US007546881B2

(12) United States Patent
Lloyd et al.

(10) Patent No.: US 7,546,881 B2
(45) Date of Patent: Jun. 16, 2009

(54) APPARATUS FOR RADIALLY EXPANDING AND PLASTICALLY DEFORMING A TUBULAR MEMBER

(75) Inventors: Sam Sun Lloyd, Houston, TX (US); Lev Ring, Houston, TX (US); David Paul Brisco, Duncan, OK (US); Kevin K. Waddell, Houston, TX (US); Robert Lance Cook, Katy, TX (US); Brock Wayne Watson, Carrollton, TX (US); Harold Otis Treece, Duncan, OK (US); Edwin Arnold Zwald, Jr., Houston, TX (US); Akin Olufowoshe, Katy, TX (US)

(73) Assignee: Enventure Global Technology, LLC, Houston, TX (US)

( * ) Notice: Subject to any disclaimer, the term of this patent is extended or adjusted under 35 U.S.C. 154(b) by 93 days.

(21) Appl. No.: 11/552,703

(22) Filed: Oct. 25, 2006

(65) Prior Publication Data

US 2007/0144735 A1 Jun. 28, 2007

Related U.S. Application Data

(63) Continuation-in-part of application No. 10/488,574, filed as application No. PCT/US02/25608 on Aug. 13, (Continued)

(60) Provisional application No. 60/318,021, filed on Sep. 7, 2001, provisional application No. 60/387,961, filed on Jun. 12, 2002, provisional application No. 60/463,586, filed on Apr. 17, 2003, provisional application No. 60/461,094, filed on Apr. 8, 2003, provisional application No. 60/459,776, filed on Apr. 2, 2003, provisional application No. 60/457,965, filed on Mar. 27, 2003, provisional application No. 60/453,678, filed on Mar. 11, 2003, provisional application No. 60/412,488, filed on Sep. 20, 2002, provisional application No. 60/380,147, filed on May 6, 2002, provisional application No. 60/363,829, filed on Mar. 13, 2002, provisional application No. 60/338,996, filed on Nov. 12, 2001, provisional application No. 60/339,013, filed on Nov. 12, 2001.

(51) Int. Cl.
*E21B 43/10* (2006.01)

(52) U.S. Cl. ..... 166/380; 166/206; 166/207; 166/217

(58) Field of Classification Search ..... 166/206, 166/207, 217, 380
See application file for complete search history.

(56) References Cited

U.S. PATENT DOCUMENTS 3,191,680 A * 6/1965 Vincent ..... 166/387

(Continued)

FOREIGN PATENT DOCUMENTS

AU 767364 2/2004

(Continued)

OTHER PUBLICATIONS

Arbuckle, "Advanced Laser Texturing Tames Tough Tasks," Metal Forming Magazine.

(Continued)

*Primary Examiner*—Shane Bomar
(74) *Attorney, Agent, or Firm*—Conley Rose, P.C.

(57) ABSTRACT

An apparatus for radially expanding and plastically deforming a tubular member. In some embodiments, the apparatus includes a support member and an adjustable expansion device coupled thereto. The adjustable expansion device includes a tubular support member with a plurality of circumferentially spaced apart inclined surfaces, a plurality of circumferentially spaced apart expansion segments movably coupled to the tubular support member, and an actuator for displacing the expansion segments relative to the tubular support member to thereby displace each of the expansion segments onto corresponding inclined surfaces.

17 Claims, 405 Drawing Sheets

Related U.S. Patent Application Data

(62) 2002, now Pat. No. 7,416,027, application No. 11/552,703, which is a continuation-in-part of application No. 10/517,755, filed as application No. PCT/US03/18530 on Jun. 12, 2003, now abandoned, application No. 11/552,703, which is a continuation-in-part of application No. 10/553,566, filed as application No. PCT/US2004/011973 on Apr. 15, 2004, said application No. 10/553,566 is a continuation-in-part of application No. 10/552,790, filed as application No. PCT/US2004/010712 on Apr. 6, 2004, now abandoned, said application No. 10/552,790 is a continuation-in-part of application No. 10/552,253, filed on Oct. 4, 2005, now abandoned, which is a continuation-in-part of application No. 10/551,880, filed as application No. PCT/US2004/010317 on Apr. 2, 2004, said application No. 10/552,253 is a continuation-in-part of application No. 10/550,906, filed as application No. PCT/US2004/009434 on Mar. 26, 2004, said application No. 10/550,906 is a continuation-in-part of application No. 10/548,934, filed as application No. PCT/US2004/007711 on Mar. 11, 2004, said application No. 10/548,934 is a continuation-in-part of application No. 10/528,497, filed as application No. PCT/US03/29460 on Sep. 22, 2003, said application No. 10/528,497 is a continuation-in-part of application No. 10/513,614, filed as application No. PCT/US03/14153 on May 6, 2003, now abandoned, said application No. 10/513,614 is a continuation-in-part of application No. 10/507,567, filed as application No. PCT/US03/04837 on Feb. 19, 2003, said application No. 10/507,567 is a continuation-in-part of application No. 10/495,347, filed as application No. PCT/US02/36157 on Nov. 12, 2002, said application No. 10/507,567 is a continuation-in-part of application No. 10/495,344, filed as application No. PCT/US02/36267 on Nov. 12, 2002, now Pat. No. 7,383,889.

U.S. PATENT DOCUMENTS

| | | | | |
|---|---|---|---|---|
| 3,785,193 | A * | 1/1974 | Kinley et al. | 72/393 |
| 6,012,523 | A * | 1/2000 | Campbell et al. | 166/277 |
| 6,068,015 | A * | 5/2000 | Pringle | 137/155 |
| 6,429,784 | B1 * | 8/2002 | Beique et al. | 340/853.2 |
| 6,622,789 | B1 * | 9/2003 | Braddick | 166/277 |
| 6,688,397 | B2 * | 2/2004 | McClurkin et al. | 166/380 |
| 6,942,036 | B2 * | 9/2005 | Gabrysch et al. | 166/312 |
| 7,028,770 | B2 * | 4/2006 | Smith et al. | 166/206 |
| 2003/0024708 | A1 * | 2/2003 | Ring et al. | 166/380 |
| 2004/0108142 | A1 * | 6/2004 | Vail, III | 175/171 |

FOREIGN PATENT DOCUMENTS

| | | | |
|---|---|---|---|
| AU | 770008 | | 7/2004 |
| AU | 770359 | | 7/2004 |
| AU | 771884 | | 8/2004 |
| AU | 776580 | | 1/2005 |
| AU | 780123 | | 3/2005 |
| AU | 2001269810 | | 8/2005 |
| AU | 782901 | | 9/2005 |
| AU | 783245 | | 10/2005 |
| AU | 2001294802 | | 10/2005 |
| CA | 736288 | | 6/1966 |
| CA | 771462 | | 11/1967 |
| CA | 1171310 | | 7/1984 |
| CA | 2292171 | | 6/2000 |
| CA | 2298139 | | 8/2000 |
| CA | 2234386 | | 3/2003 |
| DE | 174521 | | 4/1953 |
| DE | 2458188 | | 6/1975 |
| DE | 203767 | | 11/1983 |
| DE | 233607 | A1 | 3/1986 |
| DE | 278517 | A1 | 5/1990 |
| EP | 0084940 | A1 | 8/1983 |
| EP | 0272511 | | 12/1987 |
| EP | 0294264 | | 5/1988 |
| EP | 0553566 | A1 | 12/1992 |
| EP | 0633391 | A2 | 1/1995 |
| EP | 0713953 | B1 | 11/1995 |
| EP | 0823534 | | 2/1998 |
| EP | 0881354 | | 12/1998 |
| EP | 0881359 | | 12/1998 |
| EP | 0899420 | | 3/1999 |
| EP | 0937861 | | 8/1999 |
| EP | 0952305 | | 10/1999 |
| EP | 0952306 | | 10/1999 |
| EP | 1141515 | A | 10/2001 |
| EP | 1152120 | A2 | 11/2001 |
| EP | 1152120 | A3 | 11/2001 |
| EP | 1235972 | A | 9/2002 |
| EP | 1555386 | A1 | 7/2005 |
| FR | 1325596 | | 6/1962 |
| FR | 2583398 | A1 | 12/1986 |
| FR | 2717855 | A1 | 9/1995 |
| FR | 2741907 | A1 | 6/1997 |
| FR | 2771133 | A | 5/1999 |
| FR | 2780751 | | 1/2000 |
| FR | 2841626 | A1 | 1/2004 |
| GB | 2368865 | A | 7/2000 |
| GB | 2374622 | A | 10/2000 |
| GB | 2357099 | A | 12/2000 |
| GB | 2361724 | | 10/2001 |
| GB | 2365898 | A | 2/2002 |
| GB | 2359837 | B | 4/2002 |
| GB | 2370301 | A | 6/2002 |
| GB | 2371064 | A | 7/2002 |
| GB | 2371574 | A | 7/2002 |
| GB | 2373524 | | 9/2002 |
| GB | 2367842 | A | 10/2002 |
| GB | 2374098 | A | 10/2002 |
| GB | 2375560 | A | 11/2002 |
| GB | 2380213 | A | 4/2003 |
| GB | 2380503 | A | 4/2003 |
| GB | 2381019 | A | 4/2003 |
| GB | 2382364 | A | 5/2003 |
| GB | 2382828 | A | 6/2003 |
| GB | 2380213 | B | 8/2003 |
| GB | 2380214 | B | 8/2003 |
| GB | 2380215 | B | 8/2003 |
| GB | 2384800 | B | 10/2003 |
| GB | 2384801 | B | 10/2003 |
| GB | 2384802 | B | 10/2003 |
| GB | 2384803 | B | 10/2003 |
| GB | 2384804 | B | 10/2003 |
| GB | 2384805 | B | 10/2003 |
| GB | 2384806 | B | 10/2003 |
| GB | 2384807 | B | 10/2003 |
| GB | 2384808 | B | 10/2003 |
| GB | 2385353 | B | 10/2003 |
| GB | 2385354 | B | 10/2003 |
| GB | 2385356 | B | 10/2003 |
| GB | 2385357 | B | 10/2003 |
| GB | 2385358 | B | 10/2003 |
| GB | 2385359 | B | 10/2003 |
| GB | 2385360 | B | 10/2003 |
| GB | 2385361 | B | 10/2003 |
| GB | 2385362 | B | 10/2003 |
| GB | 2385363 | B | 10/2003 |
| GB | 2385619 | B | 10/2003 |
| GB | 2385620 | B | 10/2003 |
| GB | 2385621 | B | 10/2003 |
| GB | 2385622 | B | 10/2003 |

| | | | |
|---|---|---|---|
| GB | 2385623 | B | 10/2003 |
| GB | 2387405 | A | 10/2003 |
| GB | 2387861 | A | 10/2003 |
| GB | 2388134 | A | 11/2003 |
| GB | 2388860 | A | 11/2003 |
| GB | 2374622 | B | 12/2003 |
| GB | 2388391 | B | 12/2003 |
| GB | 2388392 | B | 12/2003 |
| GB | 2388393 | B | 12/2003 |
| GB | 2388394 | B | 12/2003 |
| GB | 2388395 | B | 12/2003 |
| GB | 2356651 | B | 2/2004 |
| GB | 2368865 | B | 2/2004 |
| GB | 2388860 | B | 2/2004 |
| GB | 2388861 | B | 2/2004 |
| GB | 2388862 | B | 2/2004 |
| GB | 2391886 | A | 2/2004 |
| GB | 2390628 | B | 3/2004 |
| GB | 2391033 | B | 3/2004 |
| GB | 2392686 | A | 3/2004 |
| GB | 2393199 | A | 3/2004 |
| GB | 2373524 | B | 4/2004 |
| GB | 2390387 | B | 4/2004 |
| GB | 2392686 | B | 4/2004 |
| GB | 2392691 | B | 4/2004 |
| GB | 2391575 | B | 5/2004 |
| GB | 2394979 | A | 5/2004 |
| GB | 2395506 | A | 5/2004 |
| GB | 2392932 | B | 6/2004 |
| GB | 2395734 | A | 6/2004 |
| GB | 2396635 | A | 6/2004 |
| GB | 2396639 | A | 6/2004 |
| GB | 2396640 | A | 6/2004 |
| GB | 2373468 | B | 7/2004 |
| GB | 2390622 | B | 8/2004 |
| GB | 2382367 | B | 9/2004 |
| GB | 2384502 | B | 10/2004 |
| GB | 2396640 | B | 11/2004 |
| GB | 2401631 | A | 11/2004 |
| GB | 2401632 | A | 11/2004 |
| GB | 2401633 | A | 11/2004 |
| GB | 2401634 | A | 11/2004 |
| GB | 2401635 | A | 11/2004 |
| GB | 2401636 | A | 11/2004 |
| GB | 2401637 | A | 11/2004 |
| GB | 2401638 | A | 11/2004 |
| GB | 2401639 | A | 11/2004 |
| GB | 2381019 | B | 12/2004 |
| GB | 2382368 | B | 12/2004 |
| GB | 2394979 | A | 12/2004 |
| GB | 2403970 | A | 1/2005 |
| GB | 2403971 | A | 1/2005 |
| GB | 2403972 | A | 1/2005 |
| GB | 2404402 | A | 2/2005 |
| GB | 2404676 | A | 2/2005 |
| GB | 2404680 | A | 2/2005 |
| GB | 2384807 | C | 3/2005 |
| GB | 2388134 | B | 3/2005 |
| GB | 2405893 | A | 3/2005 |
| GB | 2406117 | A | 3/2005 |
| GB | 2406118 | A | 3/2005 |
| GB | 2406119 | A | 3/2005 |
| GB | 2406120 | A | 3/2005 |
| GB | 2406125 | A | 3/2005 |
| GB | 2406126 | A | 3/2005 |
| GB | 2410518 | A | 3/2005 |
| GB | 2389597 | B | 5/2005 |
| GB | 2401630 | B | 5/2005 |
| GB | 2401631 | B | 5/2005 |
| GB | 2401632 | B | 5/2005 |
| GB | 2401633 | B | 5/2005 |
| GB | 2401634 | B | 5/2005 |
| GB | 2401635 | B | 5/2005 |
| GB | 2401636 | B | 5/2005 |
| GB | 2401637 | B | 5/2005 |
| GB | 2401638 | B | 5/2005 |
| GB | 2401639 | B | 5/2005 |
| GB | 2408278 | A | 5/2005 |
| GB | 2409216 | A | 6/2005 |
| GB | 2409218 | A | 6/2005 |
| GB | 2401893 | B | 7/2005 |
| GB | 2414749 | A | 7/2005 |
| GB | 2414750 | A | 7/2005 |
| GB | 2414751 | A | 7/2005 |
| GB | 2403970 | B | 8/2005 |
| GB | 2403971 | B | 8/2005 |
| GB | 2403972 | B | 8/2005 |
| GB | 2380503 | B | 10/2005 |
| GB | 2382828 | B | 10/2005 |
| GB | 2385355 | B | 10/2005 |
| GB | 2412681 | A | 10/2005 |
| GB | 2412682 | A | 10/2005 |
| GB | 2413136 | A | 10/2005 |
| GB | 2414493 | A | 11/2005 |
| GB | 2409217 | B | 12/2005 |
| GB | 2410518 | B | 12/2005 |
| GB | 2415003 | A | 12/2005 |
| GB | 2415219 | A | 12/2005 |
| GB | 2395506 | B | 1/2006 |
| GB | 2412681 | B | 1/2006 |
| GB | 2412682 | B | 1/2006 |
| GB | 2415979 | A | 1/2006 |
| GB | 2415983 | A | 1/2006 |
| GB | 2415987 | A | 1/2006 |
| GB | 2415998 | A | 1/2006 |
| GB | 2416177 | A | 1/2006 |
| GB | 2416361 | A | 1/2006 |
| GB | 2416556 | A | 2/2006 |
| GB | 2416794 | A | 2/2006 |
| GB | 2416795 | A | 2/2006 |
| GB | 2417273 | A | 2/2006 |
| GB | 2417275 | A | 2/2006 |
| GB | 2418216 | A | 3/2006 |
| GB | 2418217 | A | 3/2006 |
| GB | 2418941 | A | 4/2006 |
| GB | 2418942 | A | 4/2006 |
| GB | 2418943 | A | 4/2006 |
| GB | 2418944 | A | 4/2006 |
| GB | 2419907 | A | 5/2006 |
| GB | 2419913 | A | 5/2006 |
| GB | 2420810 | A | 6/2006 |
| GB | 2421257 | A | 6/2006 |
| GB | 2421258 | A | 6/2006 |
| GB | 2421259 | A | 6/2006 |
| GB | 2421262 | A | 6/2006 |
| GB | 2408277 | A | 5/2008 |
| ID | 044392/2005 | | 9/2005 |
| JP | 208458 | | 10/1985 |
| JP | 6475715 | | 3/1989 |
| JP | 102875 | | 4/1995 |
| JP | 11-169975 | | 6/1999 |
| JP | 94068 | A | 4/2000 |
| JP | 107870 | A | 4/2000 |
| JP | 162192 | | 6/2000 |
| JP | 2001-47161 | | 2/2001 |
| NL | 9001081 | | 12/1991 |
| RO | 113267 | B1 | 5/1998 |
| RU | 1786241 | A1 | 1/1993 |
| RU | 1804543 | A3 | 3/1993 |
| RU | 1810482 | A1 | 4/1993 |
| RU | 1818459 | A1 | 5/1993 |
| RU | 2016345 | C1 | 7/1994 |
| RU | 2039214 | C1 | 7/1995 |
| RU | 2056201 | C1 | 3/1996 |
| RU | 2064357 | C1 | 7/1996 |
| RU | 2068940 | C1 | 11/1996 |

| | | | |
|---|---|---|---|
| RU | 2068943 | C1 | 11/1996 |
| RU | 2079633 | C1 | 5/1997 |
| RU | 2083798 | C1 | 7/1997 |
| RU | 2091655 | C1 | 9/1997 |
| RU | 2095179 | C1 | 11/1997 |
| RU | 2105128 | C1 | 2/1998 |
| RU | 2108445 | C1 | 4/1998 |
| RU | 2144128 | C1 | 1/2000 |
| SU | 350833 | | 9/1972 |
| SU | 511468 | | 9/1976 |
| SU | 607950 | | 5/1978 |
| SU | 612004 | | 5/1978 |
| SU | 620582 | | 7/1978 |
| SU | 641070 | | 1/1979 |
| SU | 909114 | | 5/1979 |
| SU | 832049 | | 5/1981 |
| SU | 853089 | | 8/1981 |
| SU | 874952 | | 10/1981 |
| SU | 894169 | | 1/1982 |
| SU | 899850 | | 1/1982 |
| SU | 907220 | | 2/1982 |
| SU | 953172 | | 8/1982 |
| SU | 959878 | | 9/1982 |
| SU | 976019 | | 11/1982 |
| SU | 976020 | | 11/1982 |
| SU | 989038 | | 1/1983 |
| SU | 1002514 | | 3/1983 |
| SU | 1041671 | A | 9/1983 |
| SU | 1051222 | A | 10/1983 |
| SU | 1086118 | A | 4/1984 |
| SU | 1077803 | A | 7/1984 |
| SU | 1158400 | A | 5/1985 |
| SU | 1212575 | A | 2/1986 |
| SU | 1250637 | A1 | 8/1986 |
| SU | 1324722 | A1 | 7/1987 |
| SU | 1411434 | | 7/1988 |
| SU | 1430498 | A1 | 10/1988 |
| SU | 1432190 | A1 | 10/1988 |
| SU | 1601330 | A1 | 10/1990 |
| SU | 1627663 | A2 | 2/1991 |
| SU | 1659621 | A1 | 6/1991 |
| SU | 1663179 | A2 | 7/1991 |
| SU | 1663180 | A1 | 7/1991 |
| SU | 1677225 | A1 | 9/1991 |
| SU | 1677248 | A1 | 9/1991 |
| SU | 1686123 | A1 | 10/1991 |
| SU | 1686124 | A1 | 10/1991 |
| SU | 1686125 | A1 | 10/1991 |
| SU | 1698413 | A1 | 12/1991 |
| SU | 1710694 | A | 2/1992 |
| SU | 1730429 | A1 | 4/1992 |
| SU | 1745873 | A1 | 7/1992 |
| SU | 1747673 | A1 | 7/1992 |
| SU | 1749267 | A1 | 7/1992 |
| SU | 1295799 | A1 | 2/1995 |
| WO | WO81/00132 | | 1/1981 |
| WO | WO90/05598 | | 3/1990 |
| WO | WO92/01859 | | 2/1992 |
| WO | WO92/08875 | | 5/1992 |
| WO | WO93/25799 | | 12/1993 |
| WO | WO93/25800 | | 12/1993 |
| WO | WO94/21887 | | 9/1994 |
| WO | WO94/25655 | | 11/1994 |
| WO | WO95/03476 | | 2/1995 |
| WO | WO96/01937 | | 1/1996 |
| WO | WO96/21083 | | 7/1996 |
| WO | WO96/26350 | | 8/1996 |
| WO | WO96/37681 | | 11/1996 |
| WO | WO97/06346 | | 2/1997 |
| WO | WO97/11306 | | 3/1997 |
| WO | WO97/17524 | | 5/1997 |
| WO | WO97/17526 | | 5/1997 |
| WO | WO97/17527 | | 5/1997 |
| WO | WO97/20130 | | 6/1997 |
| WO | WO97/21901 | | 6/1997 |
| WO | WO97/35084 | | 9/1997 |
| WO | WO98/00626 | | 1/1998 |
| WO | WO98/07957 | | 2/1998 |
| WO | WO98/09053 | | 3/1998 |
| WO | WO98/22690 | | 5/1998 |
| WO | WO98/26152 | | 6/1998 |
| WO | WO98/42947 | | 10/1998 |
| WO | WO98/49423 | | 11/1998 |
| WO | WO99/02818 | | 1/1999 |
| WO | WO99/04135 | | 1/1999 |
| WO | WO99/06670 | | 2/1999 |
| WO | WO99/08827 | | 2/1999 |
| WO | WO99/08828 | | 2/1999 |
| WO | WO99/18328 | | 4/1999 |
| WO | WO99/23354 | | 5/1999 |
| WO | WO99/25524 | | 5/1999 |
| WO | WO99/25951 | | 5/1999 |
| WO | WO99/35368 | | 7/1999 |
| WO | WO99/43923 | | 9/1999 |
| WO | WO00/01926 | | 1/2000 |
| WO | WO00/04271 | | 1/2000 |
| WO | WO00/08301 | | 2/2000 |
| WO | WO00/26500 | | 5/2000 |
| WO | WO00/26501 | | 5/2000 |
| WO | WO00/26502 | | 5/2000 |
| WO | WO00/31375 | | 6/2000 |
| WO | WO00/37766 | | 6/2000 |
| WO | WO00/37767 | | 6/2000 |
| WO | WO00/37768 | | 6/2000 |
| WO | WO00/37771 | | 6/2000 |
| WO | WO00/37772 | | 6/2000 |
| WO | WO00/39432 | | 7/2000 |
| WO | WO00/46484 | | 8/2000 |
| WO | WO00/50727 | | 8/2000 |
| WO | WO00/50732 | | 8/2000 |
| WO | WO00/50733 | | 8/2000 |
| WO | WO00/77431 | A2 | 12/2000 |
| WO | WO01/04520 | A1 | 1/2001 |
| WO | WO01/04535 | A1 | 1/2001 |
| WO | WO01/18354 | A1 | 3/2001 |
| WO | WO01/21929 | A1 | 3/2001 |
| WO | WO/0126860 | A1 | 4/2001 |
| WO | WO01/33037 | A1 | 5/2001 |
| WO | WO01/38693 | A1 | 5/2001 |
| WO | WO01/60545 | A1 | 8/2001 |
| WO | WO01/83943 | A1 | 11/2001 |
| WO | WO01/98623 | A1 | 12/2001 |
| WO | WO02/01102 | A1 | 1/2002 |
| WO | WO02/10550 | A1 | 2/2002 |
| WO | WO02/10551 | A1 | 2/2002 |
| WO | WO02/20941 | A1 | 3/2002 |
| WO | WO02/23007 | A1 | 3/2002 |
| WO | WO02/25059 | A1 | 3/2002 |
| WO | WO02/29199 | A1 | 4/2002 |
| WO | WO02/40825 | A1 | 5/2002 |
| WO | WO02/053867 | A2 | 7/2002 |
| WO | WO02/053867 | A3 | 7/2002 |
| WO | WO02/059456 | A1 | 8/2002 |
| WO | WO02/066783 | A1 | 8/2002 |
| WO | WO02/068792 | A1 | 9/2002 |
| WO | WO02/073000 | A1 | 9/2002 |
| WO | WO02/075107 | A1 | 9/2002 |
| WO | WO02/077411 | A1 | 10/2002 |
| WO | WO02/081863 | A1 | 10/2002 |
| WO | WO02/081864 | A2 | 10/2002 |
| WO | WO02/086285 | A1 | 10/2002 |
| WO | WO02/086286 | A2 | 10/2002 |
| WO | WO02/090713 | | 11/2002 |
| WO | WO02/095181 | A1 | 11/2002 |
| WO | WO02/103150 | A2 | 12/2002 |
| WO | WO03/004819 | A2 | 1/2003 |

| | | | |
|---|---|---|---|
| WO | WO03/004819 | A3 | 1/2003 |
| WO | WO03/004820 | A2 | 1/2003 |
| WO | WO03/004820 | A3 | 1/2003 |
| WO | WO03/008756 | A1 | 1/2003 |
| WO | WO03/012255 | A1 | 2/2003 |
| WO | WO03/016669 | A2 | 2/2003 |
| WO | WO03/016669 | A3 | 2/2003 |
| WO | WO03/023178 | A2 | 3/2003 |
| WO | WO03/023178 | A3 | 3/2003 |
| WO | WO03/023179 | A2 | 3/2003 |
| WO | WO03/023179 | A3 | 3/2003 |
| WO | WO03/029607 | A1 | 4/2003 |
| WO | WO03/029608 | A1 | 4/2003 |
| WO | WO03/036018 | A2 | 5/2003 |
| WO | WO03/042486 | A2 | 5/2003 |
| WO | WO03/042486 | A3 | 5/2003 |
| WO | WO03/042487 | A2 | 5/2003 |
| WO | WO03/042487 | A3 | 5/2003 |
| WO | WO03/042489 | A2 | 5/2003 |
| WO | WO03/048520 | A1 | 6/2003 |
| WO | WO03/048521 | A2 | 6/2003 |
| WO | WO03/055616 | A2 | 7/2003 |
| WO | WO03/058022 | A2 | 7/2003 |
| WO | WO03/058022 | A3 | 7/2003 |
| WO | WO03/059549 | A1 | 7/2003 |
| WO | WO03/064813 | A1 | 8/2003 |
| WO | WO03/069115 | A3 | 8/2003 |
| WO | WO03/071086 | A2 | 8/2003 |
| WO | WO03/071086 | A3 | 8/2003 |
| WO | WO03/078785 | A2 | 9/2003 |
| WO | WO03/078785 | A3 | 9/2003 |
| WO | WO03/086675 | A2 | 10/2003 |
| WO | WO03/086675 | A3 | 10/2003 |
| WO | WO03/089161 | A2 | 10/2003 |
| WO | WO03/089161 | A3 | 10/2003 |
| WO | WO03/093623 | A2 | 11/2003 |
| WO | WO03/093623 | A3 | 11/2003 |
| WO | WO03/102365 | A1 | 12/2003 |
| WO | WO03/104601 | A2 | 12/2003 |
| WO | WO03/104601 | A3 | 12/2003 |
| WO | WO03/106130 | A2 | 12/2003 |
| WO | WO03/106130 | A3 | 12/2003 |
| WO | WO2004/003337 | A1 | 1/2004 |
| WO | WO2004/009950 | A1 | 1/2004 |
| WO | WO2004/010039 | A2 | 1/2004 |
| WO | WO2004/010039 | A3 | 1/2004 |
| WO | WO2004/011776 | A2 | 2/2004 |
| WO | WO2004/011776 | A3 | 2/2004 |
| WO | WO2004/018823 | A2 | 3/2004 |
| WO | WO2004/018823 | A3 | 3/2004 |
| WO | WO2004/018824 | A2 | 3/2004 |
| WO | WO2004/018824 | A3 | 3/2004 |
| WO | WO2004/020895 | A2 | 3/2004 |
| WO | WO2004/020895 | A3 | 3/2004 |
| WO | WO2004/023014 | A2 | 3/2004 |
| WO | WO2004/023014 | A3 | 3/2004 |
| WO | WO2004/026017 | A2 | 4/2004 |
| WO | WO2004/026017 | A3 | 4/2004 |
| WO | WO2004/026073 | A2 | 4/2004 |
| WO | WO2004/026073 | A3 | 4/2004 |
| WO | WO2004/026500 | A2 | 4/2004 |
| WO | WO2004/026500 | A3 | 4/2004 |
| WO | WO2004/027200 | A2 | 4/2004 |
| WO | WO2004/027200 | A3 | 4/2004 |
| WO | WO2004/027204 | A2 | 4/2004 |
| WO | WO2004/027204 | A3 | 4/2004 |
| WO | WO2004/027205 | A2 | 4/2004 |
| WO | WO2004/027205 | A3 | 4/2004 |
| WO | WO2004/027392 | A1 | 4/2004 |
| WO | WO2004/027786 | A2 | 4/2004 |
| WO | WO2004/027786 | A3 | 4/2004 |
| WO | WO2004/053434 | A2 | 6/2004 |
| WO | WO2004/053434 | A3 | 6/2004 |
| WO | WO2004/057715 | A2 | 7/2004 |
| WO | WO2004/057715 | A3 | 7/2004 |
| WO | WO2004/067961 | A2 | 8/2004 |
| WO | WO2004/067961 | A3 | 8/2004 |
| WO | WO2004/072436 | A1 | 8/2004 |
| WO | WO2004/074622 | A2 | 9/2004 |
| WO | WO2004/074622 | A3 | 9/2004 |
| WO | WO2004/076798 | A2 | 9/2004 |
| WO | WO2004/076798 | A3 | 9/2004 |
| WO | WO2004/081346 | A2 | 9/2004 |
| WO | WO2004/083591 | A2 | 9/2004 |
| WO | WO2004/083591 | A3 | 9/2004 |
| WO | WO2004/083592 | A2 | 9/2004 |
| WO | WO2004/083592 | A3 | 9/2004 |
| WO | WO2004/083593 | A2 | 9/2004 |
| WO | WO2004/083594 | A2 | 9/2004 |
| WO | WO2004/083594 | A3 | 9/2004 |
| WO | WO2004/085790 | A2 | 10/2004 |
| WO | WO2004/089608 | A2 | 10/2004 |
| WO | WO2004/092527 | A2 | 10/2004 |
| WO | WO2004/092528 | A2 | 10/2004 |
| WO | WO2004/092528 | A3 | 10/2004 |
| WO | WO2004/092530 | A2 | 10/2004 |
| WO | WO2004/092530 | A3 | 10/2004 |
| WO | WO2004/094766 | A2 | 11/2004 |
| WO | WO2004/094766 | A3 | 11/2004 |
| WO | WO2005/017303 | A2 | 2/2005 |
| WO | WO2005/021921 | A2 | 3/2005 |
| WO | WO2005/021921 | A3 | 3/2005 |
| WO | WO2005/021922 | A3 | 3/2005 |
| WO | WO2005/024141 | A3 | 3/2005 |
| WO | WO2005/024170 | A2 | 3/2005 |
| WO | WO2005/024170 | A3 | 3/2005 |
| WO | WO2005/024171 | A2 | 3/2005 |
| WO | WO2005/028803 | A2 | 3/2005 |
| WO | WO2005/201922 | A2 | 3/2005 |
| WO | WO2005/071212 | A1 | 4/2005 |
| WO | WO2005/079186 | A2 | 9/2005 |
| WO | WO2005/079186 | A3 | 9/2005 |
| WO | WO2005/081803 | A2 | 9/2005 |
| WO | WO2005/086614 | A2 | 9/2005 |
| WO | WO2006/014333 | A2 | 2/2006 |
| WO | WO2006/020723 | A2 | 2/2006 |
| WO | WO2006/020726 | A2 | 2/2006 |
| WO | WO2006/020734 | A2 | 2/2006 |
| WO | WO2006/020809 | A2 | 2/2006 |
| WO | WO2006/020810 | A2 | 2/2006 |
| WO | WO2006/020827 | A2 | 2/2006 |
| WO | WO2006/020827 | A3 | 2/2006 |
| WO | WO2006/020913 | A2 | 2/2006 |
| WO | WO2006/020960 | A2 | 2/2006 |
| WO | WO2006/033720 | A2 | 3/2006 |

OTHER PUBLICATIONS

Baker Hughes, "Expatch Expandable Cladding System," Oct. 2002.
Baker Hughes, "Express Expandable Screen System."
Baker Hughes, "Formlock Expandable Liner Hangers."
Banabic, "Research Projects," Jan. 30, 1999.
Blasingame et al., "Solid Expandable Tubular Technology in Mature Basins," *Society of Petroleum Engineers* 2003.
Brass et al., "Water Production Management—PDO's Successful Application of Expandable Technology," *Society of Petroleum Engineers*, 2002.
Brizmer et al., "A Laser Surface Textured Parallel Thrust Bearing," *Tribology Transactions*, 46(3):397-403, 2003.
Brock et al., "An Expanded Horizon," Hart's E&P, Feb. 2000.
Buckler et al., "Expandable Cased-hole Liner Remediates Prolific Gas Well and Minimizes Loss of Production," *Offshore Technology Conference*, 15151.
Bullock, "Advances Grow Expandable Applications," *The American Oil & Gas Reporter*, Sep. 2004.

Cales, "The Development and Applications of Solid Expandable Tubular Technology," *Enventure Global Technology*, Paper 2003-136, 2003.
Cales et al., "Reducing Non-Productive Time Through the Use of Solid Expandable Tubulars: How to Beat the Curve Through Pre-Planning," *Offshore Technology Conference*, 16669, 2004.
Cales et al., "Subsidence Remediation—Extending Well Life Through the Use of Solid Expandable Casing Systems," *AADE Houston Chapter*, Mar. 27, 2001.
Campo et al., "Case Histories-Drilling and Recompletion Applications Using Solid Expandable Tubular Technology," *Society of Petroleum Engineers*, SPE/IADC 72304, 2002.
Carstens et al., "Solid Expandable Tubular Technology: The Value of Planned Installations vs. Contingency,".
Case History, "Eemskanaal—2 Groningen," Enventure Global Technology, Feb. 2002.
Case History, "Graham Ranch No. 1 Newark East Barnett Field" Enventure Global Technology, Feb. 2002.
Case History, "K.K. Camel No. 1 Ridge Field Lafayette Parish, Louisiana," Enventure Global Technology, Feb. 2002.
Case History, "Mississippi Canyon 809 URSA TLP, OSC-G 5868, No. A-12," Enventure Global Technology, Mar. 2004.
Case History, "Unocal Sequoia Mississippi Canyon 941 Well No. 2" Enventure Global Technology, 2005.
Case History, "Yibal 381 Oman," Enventure Global Technology, Feb. 2002.
Cook, "Same Internal Casing Diameter From Surface to TD," *Offshore*, Jul. 2002.
Cottrill, "Expandable Tubulars Close in on the Holy Grail of Drilling," *Upstream*, Jul. 26, 2002.
Daigle et al., "Expandable Tubulars: Field Examples of Application in Well Construction and Remediation," *Society of Petroleum Engineers*, SPE 62958, 2000.
Daneshy, "Technology Strategy Breeds Value," E&P, May 2004.
Data Sheet, "Enventure Cased-Hole Liner (CHL) System" Enventure Global Technology, Dec. 2002.
Data Sheet, "Enventure Openhole Liner (OHL) System" Enventure Global Technology, Dec. 2002.
Data Sheet, "Window Exit Applications OHL Window Exit Expansion" Enventure Global Technology, Jun. 2003.
Dean et al., "Monodiameter Drilling Liner—From Concept to Reality," *Society of Petroleum Engineers*, SPE/IADC 79790, 2003.
Demong et al.,"Breakthroughs Using Solid Expandable Tubulars to Construct Extended Reach Wells," *Society of Petroleum Engineers*, IADC/SPE 87209, 2004.
Demong et al., "Casing Design in Complex Wells: The Use of Exapndables Multilateral Technology to Attack the size Reduction Issue".
Demong et al., "Expandable Tubulars Enable Multilaterals Without Compromise on Hole Size," *Offshore*, Jun. 2003.
Demong et al., "Planning the Well Construction Process for the Use of Solid Expandable Casing," *Society of Petroleum Engineers*, SPE 85303, 2003.
Demoulin, "Les Tubes Expansibles Changent La Face Du Forage Petrolier," *L'Usine Nouvelle*, 2878:50-52, 3 Juillet 2003.
Dupal et al., "Realization of the MonoDiameter Well: Evolution of a Game-Changing Technology," *Offshore Technology Conference*, OTC 14312, 2002.
Dupal et al., "Solid Expandable Tubular Technology—A Year of Case Histories in the Drilling Environment," *Society of Petroleum Engineers*, SPE/IADC 67770, 2001.
Dupal et al., "Well Design with Expandable Tubulars Reduces Cost and Increases Success in Deepwater Applications," *Deep Offshore Technology*, 2000.
Duphorne, "Letter Re: Enventure Claims of Baker Infringement of Enventure's Expandable Patents," Apr. 1, 2005.
Egge, "Technical Overview Production Enhancement Technology," Baker Hughes, Mar. 10, 2003.
"EIS Expandable Isolation Sleeve" *Expandable Tubular Technology*, Feb. 2003.
Enventure Global Technology, "Solid Expandable Tubulars are Enabling Technology," *Drilling Contractor*, Mar.-Apr. 2001.
"Enventure Ready to Rejuvinate the North Sea," *Roustabout*, Sep. 2004.
Escobar et al., "Increasing Solid Expandable Tubular Technology Reliability in a Myriad of Downhole Environments," *Society of Petroleum Engineers*, SPE/IADC 81094, 2003
Etsion, "Improving Tribological Performance of Mechanical Seals by Laser Texturing," *Surface Technologies*, LTD.
Etsion, "A Laser Surface Textured Hydrostatic Mechanical Seal," *Sealing Technology*, Mar. 2003.
"Expandable Casing Accesses Remote Reservoirs," *Petroleum Engineer International*, Apr. 1999.
"Expandable Sand Screens," *Weatherford Completion Systems*, 2002.
Filippov et al., "Expandable Tubular Solutions," *Society of Petroleum Engineers*, SPE 56500, 1999.
"First ever SET Workshop Held in Aberdeen,"*Roustabout*, Oct. 2004.
Fischer, "Expandables and the Dream of the Monodiameter Well: A Status Report", *World Oil*, Jul. 2004.
Fontova, "Solid Expandable Tubulars (SET) Provide Value to Operators Worldwide in a Variety of Applications, " *EP Journal of Technology*, Apr. 2005.
Fraunhofer Iwu, "Research Area: Sheet Metal Forming—Superposition of Vibrations," 2001.
Furlow, "Casing Expansion, Test Process Fine Tuned on Ultra-deepwater Well," *Offshore*, Dec. 2000.
Furlow, "Expandable Casing Program Helps Operator Hit TD With Larger Tubulars," *Offshore*, Jan. 2000.
Furlow, "Expandable Solid Casing Reduces Telescope Effect," *Offshore*, Aug. 1998.
Furlow, "Agbada Well Solid Tubulars Expanded Bottom Up, Screens Expanded Top Down," *Offshore*, 2002.
Gilmer et al., "World's First Completion Set Inside Expandable Screen," *High-Tech Wells*, 2003.
Grant et al., "Deepwater Expandable Openhole Liner Case Histories: Learnings Through Field Applications," *Offshore Technology Conference*, OCT 14218, 2002.
Guichelaar et al., "Effect of Micro-Surface Texturing on Breakaway Torque and Blister Formation on Carbon-Graphite Faces in a Mechanical Seal," *Lubrication Engineering*, Aug. 2002.
Gusevik et al., "Reaching Deep Reservoir Targets Using Solid Expandable Tubulars" *Society of Petroleum Engineers*, SPE 77612, 2002.
Haefke et al., "Microtexturing of Functional Surfaces for Improving Their Tribological Performance," *Proceedings of the International Tribology Conference*, 2000.
Halliburton Completion Products, 1996.
Haut et al., "Meeting Economic Challenges of Deepwater Drilling with Expandable-Tubular Technology," *Deep Offshore Technology Conference*, 1999.
Hull, "Monodiameter Technology Keeps Hole Diameter to TD," *Offshore* Oct. 2002.
"Innovators Chart the Course."
Langley, "Case Study: Value in Drilling Derived From Application-Specific Technology," Oct. 2004.
Linzell, "Trib-Gel A Chemical Cold Welding Agent," 1999.
Lizotte, "Scratching The Surface," *PT Design*, June 19993.
Lohoefer et al.,"Expandable Liner Hanger Provides Cost-Effective Alternative Solution," *Society of Petroleum Engineers*, IADC/SPE 59151, 2000.
Mack et al., "How in Situ Expansion Affects Casing and Tubing Properties," *World Oil*, Jul. 1999. pp. 69-71.
Mack et al., "In-Situ Expansion of Casing and Tubing—Effect on Mechanical Properties and Resistance to Sulfide Stress Cracking,".
Merritt, "Casing Remediation- Extending Well Life Through The Use of Solid Expandable Casing Systems,".
Merritt et al., "Well Remediation Using Expandable Cased-Hole Liners", *World Oil.*, Jul. 2002.
Merritt et al., "Well Remediation Using Expandable Cased-Hole Liners- Summary of Case Histories".
Mohawk Energy, :Minimizing Drilling Ecoprints Houston, Dec. 16, 2005.
Moore et al., "Expandable Liner Hangers: Case Histories," *Offshore Technology Conference*, OTC 14313, 2002.

Moore et al., "Field Trial Proves Upgrades to Solid Expandable Tubulars," *Offshore Technology Conference*, OTC 14217, 2002.
News Release, "Shell and Halliburton Agree to Form Company to Develop and Market Expandable Casing Technology," Jun. 3, 1998.
Nor, et at., "Transforming Conventional Wells to Bigbore Completions Using Solid Expandable Tubular Technology," *Offshore Technology Conference*, OTC 14315, 2002.
Patin et al., "Overcoming Well Control Challenges with Solid Expandable Tubular Technology," *Offshore Technology Conference*, OTC 15152, 2003.
Power Ultrasonics, "Design and Optimisation of An Ultrasonic Die System For Forming Metal Cans," 1999.
Ratliff, "Changing Safety Paradigms in the Oil and Gas Industry," *Society of Petroleum Engineers*, SPE 90828, 2004.
Rivenbark, "Expandable Tubular Technology—Drill Deeper, Farther, More Economically, " Enventure Global Technology.
Rivenbark et al., "Solid Expandable Tubular Technology: The Value of Planned Installation vs. Contingency," *Society of Petroleum Engineers*, SPE 90821, 2004.
Rivenbark et al., "Window Exit Sidetrack Enhancements Through the Use of Solid Expandable Casing," *Society of Petroleum Engineers*, IADC/SPE 88030, 2004.
Roca et al., "Addressing Common Drilling Challenges Using Solid Expandable Tubular Technology," *Society of Petroleum Engineers*, SPE 80446, 2003.
Ronen et al., "Friction-Reducing Surface-Texturing in Reciprocating Automotive Components," *Tribology Transactions*, 44(3):359-366, 2001.
Rky et al., "Experimental Investigation of Laser Surface Texturing for Reciprocating Automotive Components," *Tribology Transactions*, 45(4):444-449, 2002.
Sanders et al., Practices for Providing Zonal Isolation in Conjunction with Expandable Casing Jobs-Case Histories, 2003.
Sanders et al., "Three Diverse Applications on Three Continents for a Single Major Operator," *Offshore Technology Conference*, OTC 16667, 2004.
"SET Technology: The Facts" 2004.
Siemers et al., "Development and Field Testing of Solid Expandable Corrosion Resistant Cased-hole Liners to Boost Gas Production in Corrosive Environments," *Offshore Technology Conference*, OTC 15149, 2003.
"Slim Well:Stepping Stone to MonoDiameter," *Hart's E&P*, Jun. 2003.
Smith, "Pipe Dream Reality," *New Technology Magazine*, Dec. 2003.
"Solid Expandable Tubulars," *Hart's E&P*, Mar. 2002.
Sparling et al., "Expanding Oil Field Tubulars Through a Window Demonstrates Value and Provides New Well Construction Option," *Offshore Technology Conference*, OTC 16664, 2004.
Sumrow, "Shell Drills World's First Monodiameter Well in South Texas," *Oil and Gas*, Oct. 21, 2002.
Touboul et al., "New Technologies Combine to Reduce Drilling Cost in Ultradeepwater Applications," *Society of Petroleum Engineers*, SPE 90830, 2004.
Turcotte et al., "Geodynamics Applications of Continuum Physics to Geological Problems," 1982.
Van Noort et al., "Using Solid Expandable Tubulars for Openhole Water Shutoff," *Society of Petroleum Engineers*, SPE 78495, 2002.
Van Noort et al., "Water Production Reduced Using Solid Expandable Tubular Technology to "Clad," in Fractured Carbonate Formation" *Offshore Technology Conference*, OTC 15153, 2003.
Von Flatern, "From Exotic to Routine—the Offshore Quick-step," *Offshore Engineer*, Apr. 2004.
Von Flatern, "Oilfield Service Trio Target Jules Verne Territory," *Offshore Engineer*, Aug. 2001.
Waddell et al., "Advances in Single-diameter Well Technology: The Next Step to Cost-Effective Optimization," *Society of Petroleum Engineers*, SPE 90818, 2004.
Waddell et al., "Installation of Solid Expandable Tubular Systems Through Milled Casing Windows," *Society of Petroleum Engineers*, IADC/SPE 87208, 2004.
Williams, "Straightening the Drilling Curve," *Oil and Gas Investor*, Jan. 2003.
www.JETLUBE.com, "Oilfield Catalog—Jet-Lok Product Applicatin Descriptions," 1998.
www.MATERIALSRESOURCES.com, "Low Temperature Bonding of Dissimilar and Hard-to-Bond Materials and Metals Including," 2004.
www.MITCHMET.com, "3d Surface Texture Parameters," 2004.
www.SPURIND.com, "Glavanic Protection, Metallurgical Bonds, Custom Fabrications -Spur Industries," 2000.
"Expand Your Opportunities." *Enventure*. CD-ROM. Jun. 1999.
"Expand Your Opportunities." *Enventure*. CD-ROM. May 2001.
International Search Report, Application PCT/IL00/00245, Sep. 18, 2000.
International Search Report, Application PCT/US00/18635, Nov. 24, 2000.
International Search Report, Application PCT/US00/27645, Dec. 29, 2000.
International Search Report, Application PCT/US00/30022, Mar. 27, 2001.
International Search Report, Application PCT/US01/04753, Jul. 3, 2001.
International Search Report, Application PCT/US01/19014, Nov. 23, 2001.
International Search Report, Application PCT/US01/23815, Nov. 16, 2001.
International Search Report, Application PCT/US01/28960, Jan. 22, 2002.
International Search Report, Application PCT/US01/30256, Jan. 3, 2002.
International Search Report, Application PCT/US01/41446, Oct. 30, 2001.
International Search Report, Application PCT/US02/00093, Aug. 6, 2002.
International Search Report, Application PCT/US02/00677, Jul. 17, 2002.
International Search Report, Application PCT/US02/00677, Feb. 24, 2004.
International Search Report, Application PCT/US02/04353, Jun. 24, 2002.
International Search Report, Application PCT/US02/20256, Jan. 3, 2003.
International Search Report, Application PCT/US02/20477, Oct. 31, 2003.
International Search Report, Application PCT/US02/20477, Apr. 6, 2004.
International Search Report, Application PCT/US02/24399, Feb. 27, 2004.
International Search Report, Application PCT/US02/25608, May 24, 2004.
International Search Report, Application PCT/US02/25727, Feb. 19, 2004.
International Search Report, Application PCT/US02/29856, Dec. 16, 2002.
International Search Report, Application PCT/US02/36157, Sep. 29, 2003.
International Search Report, Application PCT/US02/36267, May 21, 2004.
International Search Report, Application PCT/US02/39418, Mar. 24, 2003.
International Search Report, Application PCT/US02/39425, May 28, 2004.
International Search Report, Application PCT/US03/00609, May 20, 2004.
International Search Report, Application PCT/US03/04837, May 28, 2004.
International Search Report, Application PCT/US03/06544, Jun. 9, 2004.
International Search Report, Application PCT/US03/10144, Oct. 31, 2003.
International Search Report, Application PCT/US03/11765, Nov. 13, 2003.
International Search Report, Application PCT/US03/13787, May 28, 2004.

International Search Report, Application PCT/US03/14153, May 28, 2004.
International Search Report, Application PCT/US03/15020, Jul. 30, 2003.
International Search Report, Application PCT/US03/15020, Nov. 14, 2005.
International Search Report, Application PCT/US03/18530, Jun. 24, 2004.
International Search Report, Application PCT/US03/19993, May 24, 2004.
International Search Report, Application PCT/US03/20694, Nov. 12, 2003.
International Search Report, Application PCT/US03/20870, May 24, 2004.
International Search Report, Application PCT/US03/24779, Mar. 3, 2004.
International Search Report, Application PCT/US03/25667, Feb. 26, 2004.
International Search Report, Application PCT/US03/25675, May 25, 2004.
International Search Report, Application PCT/US03/25676, May 17, 2004.
International Search Report, Application PCT/US03/25677, May 21, 2004.
International Search Report, Application PCT/US03/25707, Jun. 23, 2004.
International Search Report, Application PCT/US03/25715, Apr. 9, 2004.
International Search Report, Application PCT/US03/25716, Jan. 13, 2005.
International Search Report, Application PCT/US03/25742, May 27, 2004.
International Search Report, Application PCT/US03/29460, May 25, 2004.
International Search Report, Application PCT/US03/29858, Jun. 30, 2003.
International Search Report, Application PCT/US03/29859, May 21, 2004.
International Search Report, Application PCT/US03/38550, Jun. 15, 2004.
International Preliminary Examination Report, Application PCT/US01/28690, Sep. 4, 2003.
International Preliminary Examination Report, Application PCT/US02/24399, Aug. 6, 2004.
International Preliminary Examination Report, Application PCT/US02/25608, Jun. 1, 2005.
International Preliminary Examination Report, Application PCT/US02/25727, Jul. 7, 2004.
International Preliminary Examination Report PCT/US02/36157, Apr. 14, 2004.
International Preliminary Examination Report, Application PCT/US02/36267, Jan. 4, 2004.
International Preliminary Examination Report, Application PCT/US02/39418, Feb. 18, 2005.
International Preliminary Examination Report, Application PCT/US02/39425, Nov. 16, 2005.
International Preliminary Examination Report, Application PCT/US03/04837, Dec. 9, 2004.
International Preliminary Examination Report, Application PCT/US03/06544, May 10, 2005.
International Preliminary Examination Report, Application PCT/US03/10144, Jul. 7, 2004.
International Preliminary Examination Report, Application PCT/US03/11765, Dec. 10, 2004.
International Preliminary Examination Report, Application PCT/US03/11765, Jan. 25, 2005.
International Preliminary Examination Report, Application PCT/US03/11765, Jul. 18, 2005.
International Preliminary Examination Report, Application PCT/US01/11765, Aug. 15, 2005.
International Preliminary Examination Report, Application PCT/US03/13787, Mar. 2, 2005.
International Preliminary Examination Report, Application PCT/US03/13787, Apr. 7, 2005.
International Preliminary Examination Report, Application PCT/US03/14153, May 12, 2005.
International Preliminary Examination Report, Application PCT/US03/15020, May 9, 2005.
International Preliminary Examination Report, Application PCT/US03/15020 (corrected), Nov. 14, 2004.
International Preliminary Examination Report, Application PCT/US03/20870, Sep. 30, 2004.
International Preliminary Examination Report, Application PCT/US03/25667, May 25, 2005.
International Preliminary Examination Report, Application PCT/US03/25675, Aug. 30, 2005.
International Preliminary Examination Report, Application PCT/US0325676, Aug. 17, 2004.
International Preliminary Examination Report, Application PCT/US03/25677, Aug. 17, 2004.
International Preliminary Examination Report, Application PCT/US03/25742, Dec. 20, 2004.
International Preliminary Examination Report, Application PCT/US03/29460, Dec. 8, 2004.
International Preliminary Examination Report, Application PCT/US03/29858, May 23, 2005.
International Preliminary Examination Report, Application PCT/US03/29859, Aug. 16, 2004.
International Preliminary Examination Report, Application PCT/US03/38550, May 23, 2005.
International Preliminary Report on Patentability, Application PCT/US04/00631, Mar. 2, 2006.
International Preliminary Report on Patentability, Application PCT/US04/02122, May 13, 2005.
International Preliminary Report on Patentability, Application PCT/US04/04740, Apr. 27, 2005.
International Preliminary Report on Patentability, Application PCT/US04/04740, Jun. 27, 2006.
International Preliminary Report on Patentability, Application PCT/US04/06246, May 5, 2005.
International Preliminary Report on Patentability, Application PCT/US04/08030, Apr. 7, 2005.
International Preliminary Report on Patentability, Application PCT/US04/08030, Jun. 10, 2005.
International Preliminary Report on Patentability, Application PCT/US04/08073, May 9, 2005.
International Preliminary Report on Patentability, Application PCT/US04/008170, Sep. 29, 2005.
International Preliminary Report on Patentability, Application PCT/US04/08171, Sep. 13, 2005.
International Preliminary Report on Patentability, Application PCT/US04/10317, Jun. 23, 2006.
International Preliminary Report on Patentability, Application PCT/US04/11177, Jun. 9, 2005.
International Preliminary Report on Patentability, Application PCT/US04/028423, Mar. 9, 2006.
International Preliminary Report on Patentability, Application PCT/US04/028423, Jun. 19, 2006.
International Preliminary Report on Patentability, Application PCT/US04/28438, Sep. 20, 2005.
Written Opinion to Application No. PCT/US01/19014, Dec. 10, 2002.
Written Opinion to Application No. PCT/US01/23815, Jul. 25, 2002.
Written Opinion to Application No. PCT/US01/28960, Dec. 2, 2002.
Written Opinion to Application No. PCT/US01/30256, Nov. 27, 2002.
Written Opinion to Application No. PCT/US02/00093, Apr. 21, 2003.
Written Opinion to Application No. PCT/US02/00677, Apr. 17, 2003.
Written Opinion to Application No. PCT/US02/04353, Apr. 11, 2003.
Written Opinion to Application No. PCT/US02/20256, May 9, 2003.
Written Opinion to Application No. PCT/US02/24399, Apr. 28, 2004.

Written Opinion to Application No. PCT/US02/25608, Sep. 13, 2004.
Written Opinion to Application No. PCT/US02/25608, Feb. 2, 2005.
Written Opinion to Application No. PCT/US02/25727, May 17, 2004.
Written Opinion to Application No. PCT/US02/39418, Jun. 9, 2004.
Written Opinion to Application No. PCT/US02/39425, Nov. 22, 2004.
Written Opinion to Application No. PCT/US02/39425, Apr. 11, 2005.
Written Opinion to Application No. PCT/US03/06544, Feb. 18, 2005.
Written Opinion to Application No. PCT/US03/11765, May 11, 2004.
Written Opinion to Application No. PCT/US03/13787, Nov. 9, 2004.
Written Opinion to Application No. PCT/US03/14153, Sep. 9, 2004.
Written Opinion to Application No. PCT/US03/14153, Nov. 9, 2004.
Written Opinion to Application No. PCT/US03/18530, Sep. 13, 2004.
Written Opinion to Application No. PCT/US03/19993, Oct. 15, 2004.
Written Opinion to Application No. PCT/US03/25675, Nov. 24, 2004.
Written Opinion to Application No. PCT/US03/25675, May 9, 2005.
Written Opinion to Application No. PCT/US03/29858, Jan. 21, 2004.
Written Opinion to Application No. PCT/US03/38550, Dec. 10, 2004.
Written Opinion to Application No. PCT/US04/08171, May 5, 2005.
Combined Search Report and Written Opinion to Application No. PCT/US04/00631, Mar. 28, 2005.
Combined Search Report and Written Opinion to Application No. PCT/US04/02122, Feb. 24, 2005.
Combined Search Report and Written Opinion to Application No. PCT/US04/04740, Jan. 19, 2005.
Combined Search Report and Written Opinion to Application No. PCT/US04/06246, Jan. 26, 2005.
Combined Search Report and Written Opinion to Application No. PCT/US04/08030, Jan. 6, 2005.
Combined Search Report and Written Opinion to Application No. PCT/US04/08073, Mar. 4, 2005.
Combined Search Report and Written Opinion to Application No. PCT/US04/08170, Jan. 13, 2005.
Combined Search Report and Written Opinion to Application No. PCT/US04/08171, Feb. 16, 2005.
Combined Search Report and Written Opinion to Application No. PCT/US04/10317, May 25, 2006.
Combined Search Report and Written Opinion to Application No. PCT/US04/10762, Sep. 1, 2005.
Combined Search Report and Written Opinion to Application No. PCT/US04/11177, Feb. 14, 2005.
Combined Search Report and Written Opinion to Application No. PCT/US04/11973, Sep. 27, 2005.
Combined Search Report and Written Opinion to Application No. PCT/US04/28423, Jul. 13, 2005.
Combined Search Report and Written Opinion to Application No. PCT/US04/28438, Mar. 14, 2005.
Combined Search Report and Written Opinion to Application No. PCT/US04/28831, Dec. 19, 2005.
Combined Search Report and Written Opinion to Application No. PCT/US0428889, Nov. 14, 2005.
Combined Search Report and Written Opinion to Application No. PCT/US05/28869, Apr. 17, 2006.
Search Report to Application No. GB 0003251.6, Jul. 13, 2000.
Search Report to Application No. GB 0004282.0, Jul. 31, 2000.
Search Report to Application No. GB 0004282.0, Jan. 15, 2001.
Search Report to Application No. GB 0004285.3, Jul. 12, 2000.
Search Report to Application No. GB 0004285.3, Jan. 17, 2001.
Search Report to Application No. GB 0005399.1, Jul. 24, 2000.
Search Report to Application No. GB 0005399.1, Feb. 15, 2001.
Search Report to Application No. GB 0013661.4, Oct. 20, 2000.
Search Report to Application No. GB 0013661.4, Apr. 17, 2001.
Search Report to Application No. GB 0013661.4, Feb. 19, 2003.
Search Report to Application No. GB 0219757.2, Nov. 25, 2002.
Search Report to Application No. GB 0219757.2, Jan. 20, 2003.
Search Report to Application No. GB 0220872.6, Dec. 5, 2002.
Search Report to Application No. GB 0220872.6, Mar. 13, 2003.
Search Report to Application No. GB 0225505.7, Mar. 5, 2003.
Search Report to Application No. GB 0415835.8, Dec. 2, 2004.
Search Report to Application No. GB 0415835.8, Mar. 10, 2005.
Search Report to Application No. GB 0507980.1 Apr. 24, 2006.
Search Report to Application No. GB 9926449.1, Mar. 27, 2000.
Search Report to Application No. GB 9926449.1, Jul. 4, 2001.
Search Report to Application No. GB 9926449.1, Sep. 5, 2001.
Search Report to Application No. GB 9926450.9, Feb. 28, 2000.
Search Report to Application No. GB 9930398.4, Jun. 27, 2000.
Examination Report to Application No. GB 0004285.3, Aug. 28, 2002.
Examination Report to Application No. GB 0004285.3, Mar. 28, 2003.
Examination Report to Application No. GB 0005399.1, Oct. 14, 2002.
Examination Report to Application No. GB 0013661.4, Nov. 25, 2003.
Examination Report to Application No. GB 0208367.3, Apr. 4, 2003.
Examination Report to Application No. GB 0208367.3, Nov. 4, 2003.
Examination Report to Application No. GB 0208367.3, Nov. 17, 2003.
Examination Report to Application No. GB 0208367.3, Jan. 30, 2004.
Examination Report to Application No. GB 0212443.6, Apr. 10, 2003.
Examination Report to Application No. GB 0216409.3, Feb 9, 2004.
Examination Report to Application No. GB 0219757.2, May 10, 2004.
Examination Report to Application No. GB 0219757.2, Oct. 31, 2004.
Examination Report to Application No. GB 0220872.6, Oct. 29, 2004.
Examination Report to Application No. GB 0225505.7, Oct. 27, 2004.
Examination Report to Application No. GB 0225505.7, Feb. 15, 2005.
Examination Report to Application No. GB 0300085.8, Nov. 28, 2003.
Examination Report to Application No. GB 030086.6, Dec. 1, 2003.
Examination Report to Application No. GB 0303220.8, Jun. 30, 2004.
Examination Report to Application No. GB 0306046.4, Sep. 10, 2004.
Examination Report to Application No. GB 0310836.2, Aug. 7, 2003.
Examination Report to Application No. GB 0311596.1, May 18, 2004.
Examination Report to Application No. GB 0314846.7, Jul. 15, 2004.
Examination Report to Application No. GB 0316883.8, Nov. 25, 2003.
Examination Report to Application No. GB 0316886.1, Nov. 25, 2003.
Examination Report to Application No. GB 0316887.9, Nov. 25, 2003.
Examination Report to Application No. GB 320747.9, May 25, 2004.
Examination Report to Application No. GB 0325071.9, Feb. 2, 2004.
Examination Report to Application No. GB 0325072.7, Feb. 2, 2004.
Examination Report to Application No. GB 0325072.7, Apr. 13, 2004.
Examination Report to Application No. GB 03701281.2, Jan. 31, 2006.
Examination Report to Application No. GB 03723674.2, Feb. 6, 2006.
Examination Report to Application No. GB 0400018.8, Oct. 29, 2004.
Examination Report to Application No. GB 0400018.8, May 17, 2005.
Examination Report to Application No. GB 0400019.6, Oct. 29, 2004.
Examination Report to Application No. GB 0400019.6, May 19, 2005.

Examination Report to Application No. GB 0400019.6, Sep. 2, 2005.
Examination Report to Application No. GB 0400019.6, Nov. 4, 2005.
Examination Report to Application No. GB 0403891.5, Feb. 14, 2005.
Examination Report to Application No. GB 0403891.5, Jun. 30, 2005.
Examination Report to Application No. GB 0403893.1, Feb. 14, 2005.
Examination Report to Application No. GB 0403894.9, Feb. 15, 2005.
Examination Report to Application No. GB 0403920.2, Feb. 15, 2005.
Examination Report to Application No. GB 0403921.0, Feb. 15, 2005.
Examination Report to Application No. GB 0404796.5, May 20, 2004.
Examination Report to Application No. GB 0404796.5, Apr. 14, 2005.
Examination Report to Application No. GB 0404830.2, Aug. 17, 2004.
Examination Report to Application No. GB 0404833.6, Aug. 19, 2004.
Examination Report to Application No. GB 0404837.7, Jul. 12, 2004.
Examination Report to Application No. GB 0406257.6, Jun. 28, 2004.
Examination Report to Application No. GB 0406257.6, Jan. 25, 2005.
Examination Report to Application No. GB 0406257.6, Mar. 3, 2005.
Examination Report to Application No. GB 0406257.6, Jun. 16, 2005.
Examination Report to Application No. GB 0406257.6, Sep. 2, 2005.
Examination Report to Application No. GB 0406257.6, Nov.9, 2005.
Examination Report to Application No. GB 0406258.4, May 20, 2004.
Examination Report to Application No. GB 04046258.4, Jan. 12, 2005.
Examination Report to Application No. GB 0406258.4, Jul. 27, 2005.
Examination Report to Application No. GB 0406258.4, Dec. 20, 2005.
Examination Report to Application No. GB 0408672.4, Jul. 12, 2004.
Examination Report to Application No. GB 0408672.4, Mar. 21, 2005.
Examination Report to Application No. GB 0411698.4, Jan. 24, 2005.
Examination Report to Application No. GB 0411892.3, Feb. 21, 2005.
Examination Report to Application No. GB 0412533.2, May 20, 2005.
Examination Report to Application No. GB 0412876.5, Feb. 13, 2006.
Examination Report to Application No. GB 0415835.8, Dec. 23, 2005.
Examination Report to Application No. GB 0416625.2, Jan. 20, 2005.
Examination Report to Application No. GB 0416834.0, Nov. 16,2004.
Examination Report to Application No. GB 0422419.2, Dec. 8, 2004.
Examination Report to Application No. GB 0422419.2, Nov. 8,2005.
Examination Report to Application No. GB 0422893.8, Aug. 8, 2005.
Examination Report to Application No. GB 0422893.8, Dec. 15, 2005.
Examination Report to Application No. GB 0425948.7, Nov. 24, 2005.
Examination Report to Application No. GB 0425956.0, Nov. 24, 2005.
Examination Report to Application No. GB 0428141.6, Feb. 9, 2005.
Examination Report to Application No. GB 0428141.6, Sep. 15, 2005.
Examination Report to Application No. GB 0428141.6, Feb. 21, 2006.
Examination Report to Application No. GB 0500184.7, Feb. 9, 2005.
Examination Report to Application No. GB 0500184.7, Sep. 12, 2005.
Examination Report to Application No. GB 0500600.2, Sep. 6, 2005.
Examination Report to Application No. GB 0500275.3, Apr. 5, 2006.
Examination Report to Application No. GB 0501667.0, May 27, 2005.
Examination Report to Application No. GB 0501667.0, Jan. 27, 2006.
Examination Report to Application No. GB 0503250.3, Nov. 15, 2005.
Examination Report to Application No. GB 0503250.3, Mar. 2, 2006.
Examination Report to Application No. GB 0503470.7, Sep. 22, 2005.
Examination Report to Application No. GB 0506699.8, Sep. 21, 2005.
Examination Report to Application No. GB 0506699.8, May 11, 2006.
Examination Report to Application No. GB 0506700.4, May 16, 2006.
Examination Report to Application No. GB 0506702.0, May 11, 2006.
Examination Report to Application No. GB 0507979.3, Jun. 16, 2005.
Examination Report to Application No. GB 0507979.3, Jan. 17, 2006.
Examination Report to Application No. GB 0507979.3, Jun. 6, 2006.
Examination Report to Application No. GB 0507980.1, Sep. 29, 2005.
Examination Report to Application No. GB 0509618.5, Feb. 3, 2006.
Examination Report to Application No. GB 0509620.1, Feb. 14, 2006.
Examination Report to Application No. GB 0509627.6, Feb. 3, 2006.
Examination Report to Application No. GB 0509629.2, Feb. 3, 2006.
Exmamination Report to Application No. GB 0509630.0, Feb. 3, 2006.
Examination Report to Application No. GB 0509630.0, May 11, 2006.
Examination Report to Application No. GB 0509630.0, Jun. 6, 2006.
Examination Report to Application No. GB 0509631.8, Feb. 14, 2006.
Examination Report to Application No. GB 0517448.7, Nov. 9, 2005.
Examination Report to Application No. GB 0518025.2, Oct. 27, 2005.
Examination Report to Application No. GB 0518025.2, May 25, 2006.
Examination Report to Application No. GB 0518039.3, Nov. 29, 2005.
Examination Report to Application No. GB 0518252.2, Oct. 28,2005.
Examination Report to Application No. GB 0518252.2, May 25, 2006.
Examination Report to Application No. GB 0518799.2, Nov. 9, 2005.
Examination Report to Application No. GB 0518799.2, Jun. 14, 2006.
Examination Report to Application No. GB 0518893.3, Dec. 16, 2005.
Examination Report to Application No. GB 0519989.8, Mar. 8, 2006.
Examination Report to Application No. GB 0521024.0, Dec. 22, 2005.
Examination Report to Application No. GB 0522050.4, Dec. 13, 2005.
Examination Report to Application No. GB 0602877.3, Mar. 20, 2006.
Examination Report to Application No. GB 0603576.0, Apr. 5, 2006.
Examination Report to Application No. GB 0603656.0, May 3, 2006.
Examination Report to Application No. GB 0603995.2, Apr. 25, 2006.
Examination Report to Application No. GB 0603996.0, Apr. 27, 2006.
Examination Report to Application No. GB 0604357.4, Apr. 27, 2006.
Examination Report to Application No. GB 0604359.0, Apr. 27, 2006.
Examination Report to Application No. GB 0604360.8, Apr. 26, 2006.

Examination Report to Application No. GB 9926450.9, May 15, 2002.
Examination Report to Application No. GB 9926450.9, Nov. 22, 2002.
Search and Examination Report to Application No. GB 0004282.0, Jun. 3, 2003.
Search and Examination Report to Application No. GB 0225505.7, Jul. 1, 2003.
Search and Examination Report to Application No. GB 0308290.6, Jun. 2, 2003.
Search and Examination Report to Application No. GB 0308293.0, Jun. 2, 2003.
Search and Examination Report to Application No. GB 0308294.8, Jun. 2, 2003.
Search and Examination Report to Application No. GB 0308295.5, Jun. 2, 2003.
Search and Examination Report to Application No. GB 0308296.3, Jun. 2, 2003.
Search and Examination Report to Application No. GB 0308297.1, Jun. 2, 2003.
Search and Examination Report to Application No. GB 0308299.7, Jun. 2, 2003.
Search and Examination Report to Application No. GB 0308302.9, Jun. 2, 2003.
Search and Examination Report to Application No. GB 0308303.7, Jun. 2, 2003.
Search and Examination Report to Application No. GB 0310090.6, Jun. 24, 2003.
Search and Examination Report to Application No. GB 0310099.7, Jun. 24, 2003.
Search and Examination Report to Application No. GB 0310101.1, Jun. 24, 2003.
Search and Examination Report to Application No. GB 0310104.5, Jun. 24, 2003.
Search and Examination Report to Application No. GB 0310118.5, Jun. 24, 2003.
Search and Examination Report to Application No. GB 0310757.0, Jun. 12, 2003.
Search and Examination Report to Application No. GB 0310759.6, Jun. 12, 2003.
Search and Examination Report to Application No. GB 0310770.3, Jun. 12, 2003.
Search and Examination Report to Application No. GB 0310772.9, Jun. 12, 2003.
Search and Examination Report to Application No. GB 0310785.1, Jun. 12, 2003.
Search and Examination Report to Application No. GB 0310795.0, Jun. 12, 2003.
Search and Examination Report to Application No. GB 0310797.6, Jun. 12, 2003.
Search and Examination Report to Application No. GB 0310799.2, Jun. 12, 2003.
Search and Examination Report to Application No. GB 0310801.6, Jun. 12, 2003.
Search and Examination Report to Application No. GB 0310833.9, Jun. 12, 2003.
Search and Examination Report to Application No. GB 0310836.2, Jun. 12, 2003.
Search and Examination Report to Application No. GB 0313406.1, Sep. 3, 2003.
Search and Examination Report to Application No. GB 0316883.8, Aug. 14, 2003.
Search and Examination Report to Application No. GB 0136886.1, Aug. 14, 2003.
Search and Examination Report to Application No. GB 0316887.9, Aug. 14, 2003.
Search and Examination Report to Application No. GB 0318545.1, Sep. 3, 2003.
Search and Examination Report to Application No. GB 0318547.7; Sep. 3, 2003.
Search and Examination Report to Application No. GB 0318549.3; Sep. 3, 2003.
Search and Examination Report to Application No. GB 0318550.1, Sep. 3, 2003.
Search and Examination Report to Application No. GB 0320579.6, Dec. 16, 2003.
Search and Examination Report to Application No. GB 0320580.4, Dec. 17, 2003.
Search and Examination Report to Application No. GB 0323891.2, Dec. 19, 2003.
Search and Examination Report to Application No. GB 0324172.6, Nov. 4, 2003.
Search and Examination Report to Application No. GB 0324174.2, Nov. 4, 2003.
Search and Examination Report to Application No. GB 0325071.9, Nov. 18, 2003.
Search and Examination Report to Application No. GB 0325072.7, Dec. 3, 2003.
Search and Examination Report to Application No. GB 0403891.5, Jun. 9, 2004.
Search and Examination Report to Application No. GB 0403893.1, Jun. 9, 2004.
Search and Examination Report to Application No. GB 0403894.9, Jun. 9, 2004.
Search and Examination Report to Application No. GB 0403897.2, Jun. 9, 2004.
Search and Examination Report to Application No. GB 0403920.2, Jun. 10, 2004.
Search and Examination Report to Application No. GB 0403921.0, Jun. 10, 2004.
Search and Examination Report to Application No. GB 0403926.9, Jun. 10, 2004.
Search and Examination Report to Application No. GB 0404826.0, Apr. 21, 2004.
Search and Examination Report to Application No. GB 0404828.6, Apr. 21, 2004.
Search and Examination Report to Application No. GB 0404830.2, Apr. 21, 2004.
Search and Examination Report to Application No. GB 0404832.8, Apr. 21, 2004.
Search and Examination Report to Application No. GB 0404833.6, Apr. 21, 2004.
Search and Examination Report to Application No. GB 0404837.7, May 17, 2004.
Search and Examination Report to Application No. GB 0404839.3, May 14, 2004.
Search and Examination Report to Application No. GB 0404842.7, May 14, 2004.
Search and Examination Report to Application No. GB 0404845.0, May 14, 2004.
Search and Examination Report to Application No. GB 0404849.2, May 17, 2004.
Search and Examination Report to Application No. GB 0411698.4, Jun. 30, 2004.
Search and Examination Report to Application No. GB 0411892.3, Jul. 14, 2004.
Search and Examination Report to Application No. GB 0411893.1, Jul. 14, 2004.
Search and Examination Report to Application No. GB 0411894.9, Jun. 30, 2004.
Search and Examination Report to Application No. GB 0412190.1, Jul. 22, 2004
Search and Examination Report to Application No. GB 0412191.9, Jul. 22, 2004.
Search and Examination Report to Application No. GB 0412192.7, Jul. 22, 2004.
Search and Examination Report to Application No. GB 0412876.5, Sep. 27, 2005.
Search and Examination Report to Application No. GB 0416834.0, Aug. 11, 2004.
Search and Examination Report to Application No. GB 0417810.9, Aug. 25, 2004.
Search and Examination Report to Application No. GB 0417811.7, Aug. 25, 2004.

Search and Examination Report to Application No. GB 0418005.5, Aug. 25, 2004.
Search and Examination Report to Application No. GB 0418425.5, Sep. 10, 2004.
Search and Examination Report to Application No. GB 0418426.3 Sep. 10, 2004.
Search and Examination Report to Application No. GB 0418427.1, Sep. 10, 2004.
Search and Examination Report to Application No. GB 0418429.7, Sep. 10, 2004.
Search and Examination Report to Application No. GB 0418430.5, Sep. 10, 2004.
Search and Examination Report to Application No. GB 0418431.3, Sep. 10, 2004.
Search and Examination Report to Application No. GB 0418432.1, Sep. 10, 2004.
Search and Examination Report to Application No. GB 0418433.9, Sep. 10, 2004.
Search and Examination Report to Application No. GB 0418439.6, Sep. 10, 2004.
Search and Examination Report to Application No. GB 0418442.0, Sep. 10, 2004.
Search and Examination Report to Application No. GB 0422893.8, Nov. 24, 2004.
Search and Examination Report to Application No. GB 0423416.7, Nov. 12, 2004.
Search and Examination Report to Appliction No. GB 0423417.5, Nov. 12, 2004.
Search and Examination Report to Application No. GB 0423418.3, Nov. 12, 2004.
Search and Examination Report to Application No. GB 0425948.7, Apr. 14, 2005.
Search and Examination Report to Application No. GB 0425951.1, Apr. 14, 2005.
Search and Examination Report to Application No. GB 0425956.0, Apr. 14, 2005.
Search and Examination Report to Application No. GB 0426155.8, Jan. 12, 2005.
Search and Examination Report to Application No. GB 0426156.6, Jan. 12, 2005.
Search and Examination Report to Application No. GB 0426157.4, Jan. 12, 2005.
Search and Examination Report to Application No. GB 0500600.2, Feb. 15, 2005.
Search and Examination Report to Application No. GB 0503470.7, Mar. 21, 2005.
Search and Examination Report to Application No. GB 0505039.8, Jul. 22, 2005.
Search and Examination Report to Application No. GB 0506697.2, May 20, 2005.
Search and Examination Report to Application No. GB 0506700.4, Sep. 20, 2005.
Search and Examination Report to Application No. GB 0509618.5, Sep. 27, 2005.
Search and Examination Report to Application No. GB 0509620.1, Sep. 27, 2005.
Search and Examination Report to Application No. GB 0509626.8, Sep. 27, 2005.
Search and Examination Report to Application No. GB 0509627.6, Sep. 27, 2005.
Search and Examination Report to Application No. GB 0509629.2, Sep. 27, 2005.
Search and Examination Report to Application No. GB 0509630.0, Sep. 27, 2005.
Search and Examination Report to Application No. GB 0509631.8, Sep. 27, 2005.
Search and Examination Report to Application No. GB 0512396.3, Jul. 26, 2005.
Search and Examination Report to Application No. GB 0512398.9, Jul. 27, 2005.
Search and Examination Report to Application No. GB 0516429.8, Nov. 7, 2005.
Search and Examination Report to Application No. GB 0516430.6, Nov. 8, 2005.
Search and Examination Report to Application No. GB 0516431.4, Nov. 8, 2005.
Search and Examination Report to Application No. GB 0522155.1, Mar. 7, 2006.
Search and Examination Report to Application No. GB 0522892.9, Jan. 5, 2006.
Search and Examination Report to Application No. GB 0523075.0, Jan. 12, 2006.
Search and Examination Report to Application No. GB 0523076.8, Dec. 14, 2005.
Search and Examination Report to Application No. GB 0523078.4, Dec. 13, 2005.
Search and Examination Report to Application No. GB 0523132.9, Jan. 12, 2006.
Search and Examination Report to Application No. GB 0524692.1, Dec. 19, 2005.
Search and Examination Report to Application No. GB 0525768.8, Feb. 3, 2006.
Search and Examination Report to Application No. GB 0525770.4, Feb. 3, 2006.
Search and Examination Report to Application No. GB 0525772.0, Feb. 2, 2006.
Search and Examination Report to Application No. GB 0525774.6, Feb. 2, 2006.
Examination Report to Application No. AU 2001278196 ,Apr. 21, 2005.
Examination Report to Application No. AU 2002237757 ,Apr. 28, 2005.
Examination Report to Application No. AU 2002240366 ,Apr. 13, 2005.
Examination Report to Application No. AU 2003257878, Jan. 19, 2006.
Examination Report to Applicaiton No. AU 2003257878, Jan. 30, 2006.
Examination Report to Application No. AU 2003257881, Jan. 19, 2006.
Examination Report to Application No. AU 2003257881, Jan. 30, 2006.
Examination Report to Application No. AU 2004202805, Jun. 14, 2006.
Examination Report to Application No. AU 2004202809, Jun. 14, 2006.
Examination Report to Application No. AU 2004202812, Jun. 14, 2006.
Examination Report to Application No. AU 2004202813, Jun. 14, 2006.
Examination Report to Application No. AU 2004202815, Jun. 14, 2006.
Search Report to Application No. EP 02806451.7; Feb. 9, 2005.
Search Report to Application No. EP 03071281.2; Nov. 7, 2005.
Search Report to Application No. EP 03071281.2; Nov. 14, 2005.
Search Report to Application No. EP 03723674.2; Nov. 22, 2005.
Search Report to Application No. EP 03723674.2; May 2, 2006.
Search Report to Application No. EP 03728326.4; Mar. 13, 2006.
Search Report to Application No. EP 03728326.4; Apr. 24, 2006.
Search Report to Application No. EP 03793078.1; Mar. 21, 2006.
Search Report to Application No. EP 03759400.9; Mar. 3, 2006.
Search Report to Application No. EP 03759400.9; Mar. 24, 2006.
Search Report to Application No. EP 03793078.1; Mar. 21, 2006.
Search Report to Application No. EP 03793078.1; Jun. 16, 2006.
Search Report to Application No. Norway 1999 5593, Aug. 20, 2002.
Examination Report to Application No. Norway 2002 1613, May 13, 2006.

* cited by examiner

*Fig. 11A1*
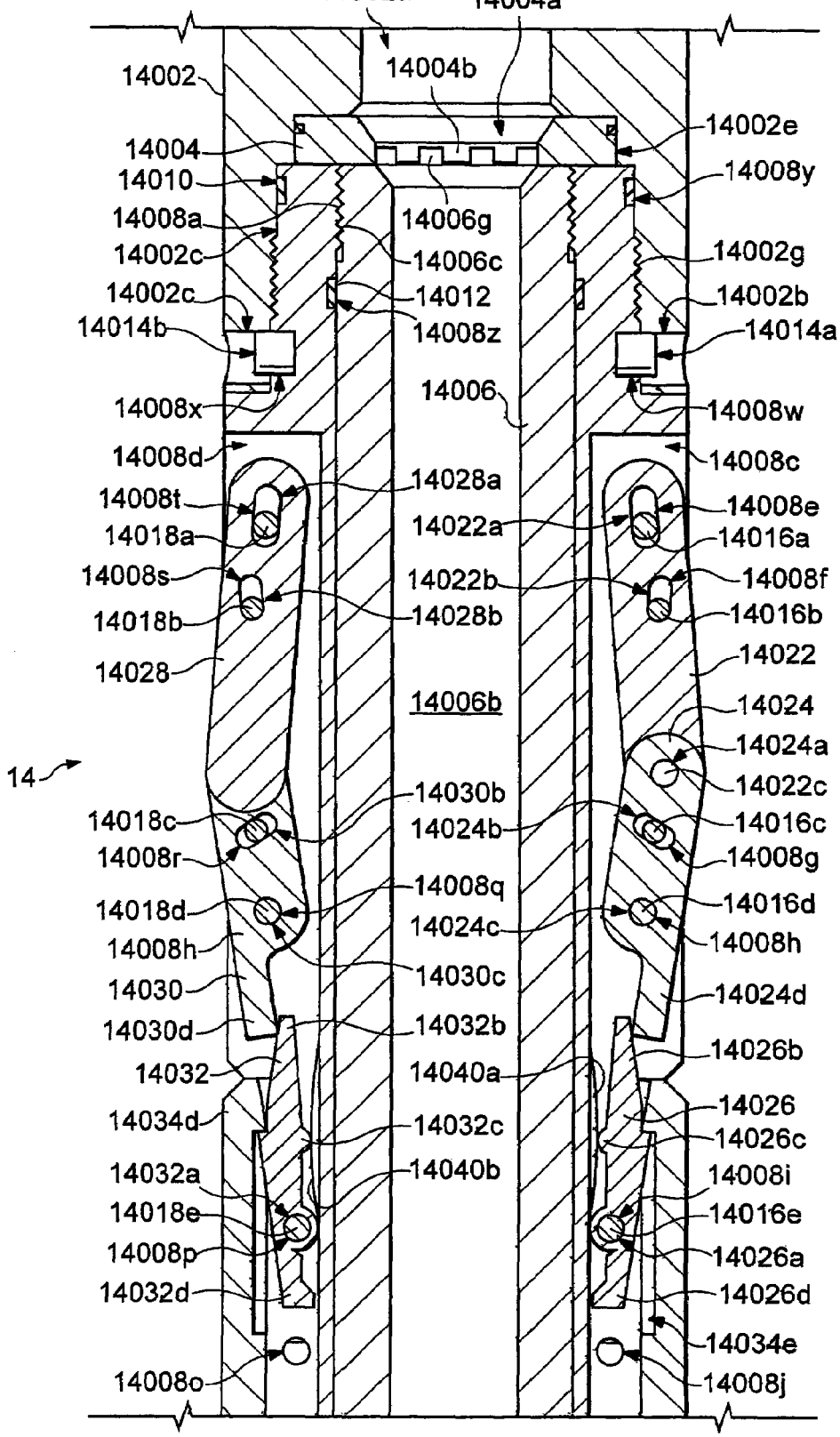

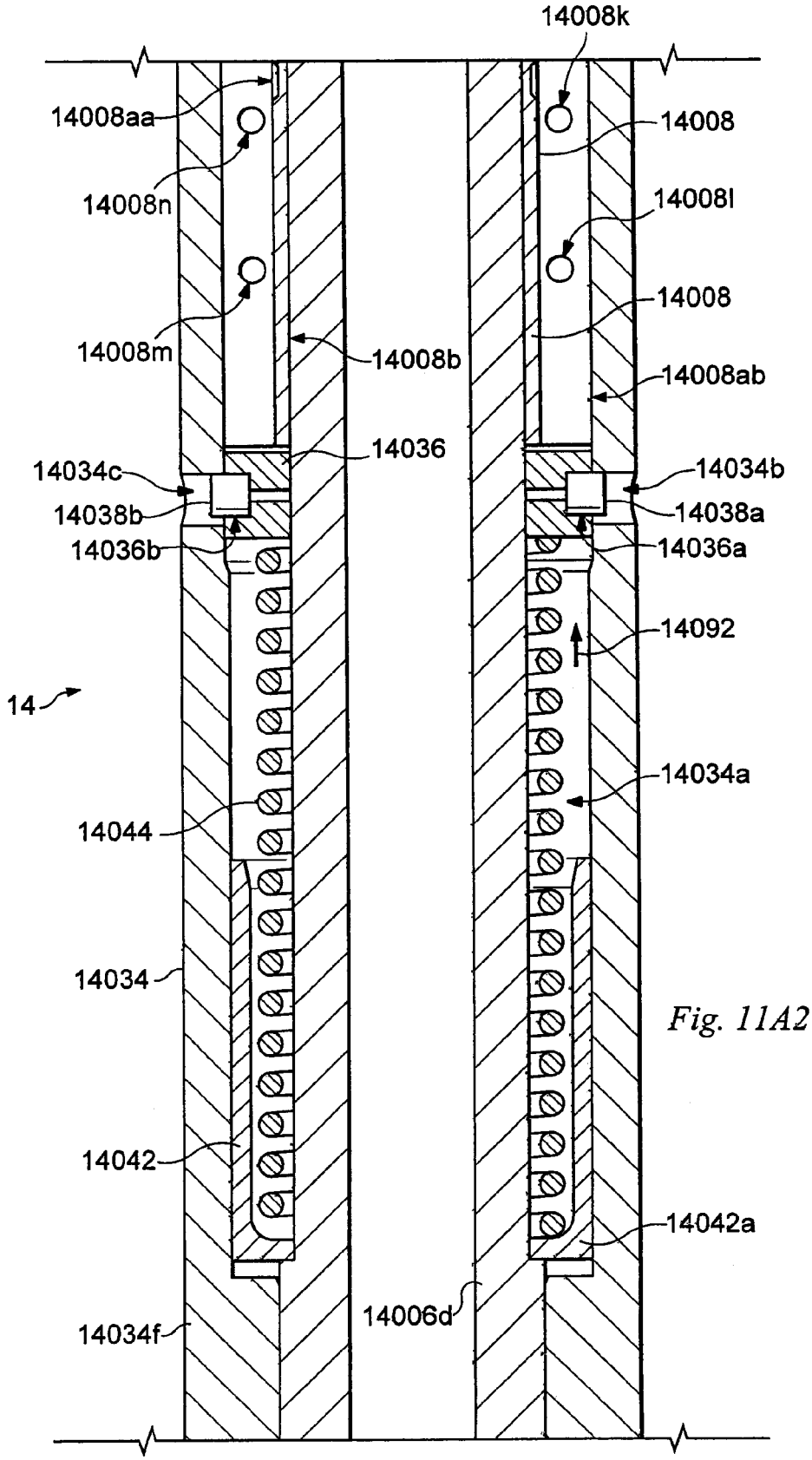
*Fig. 11A2*

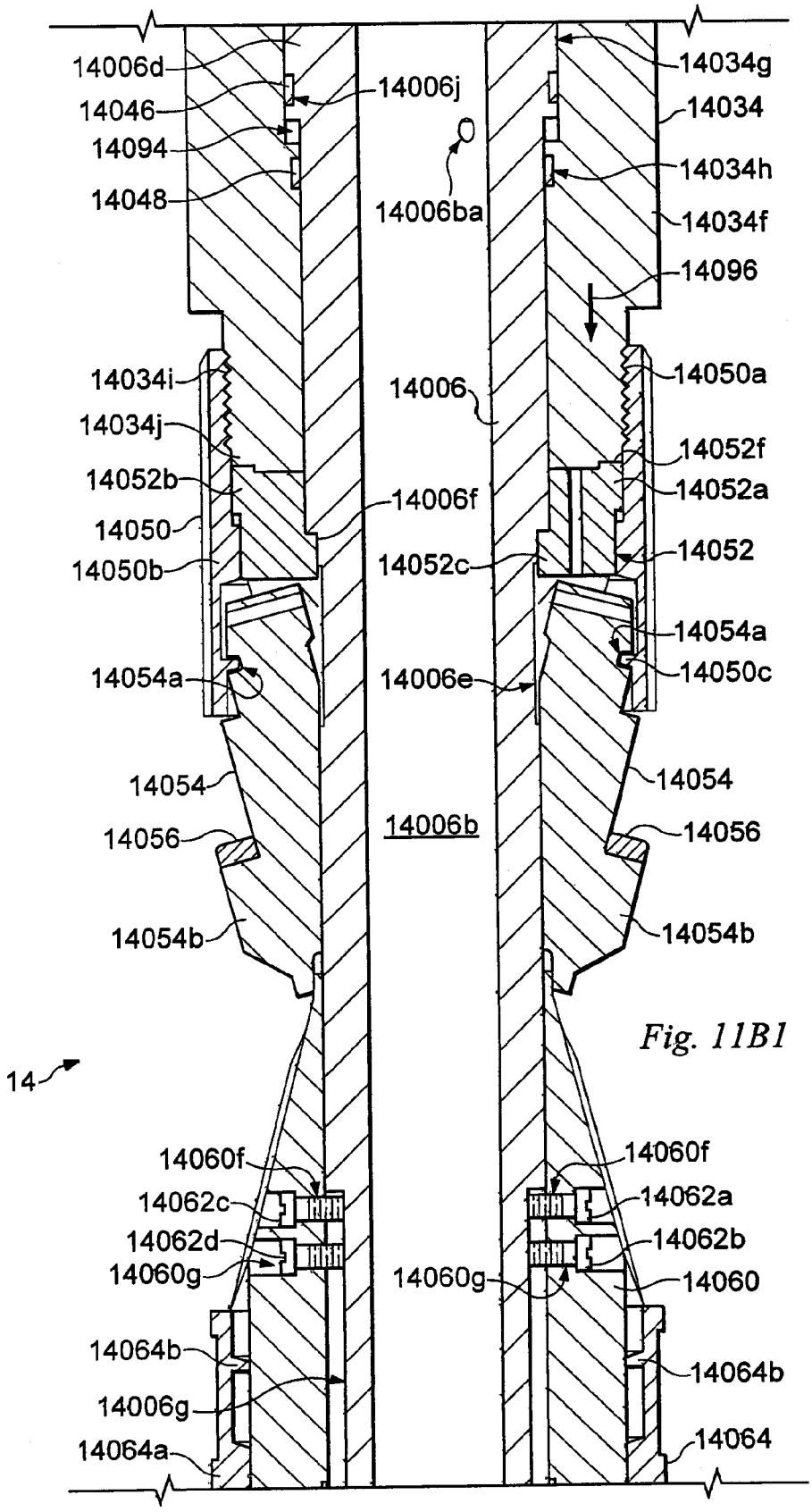
*Fig. 11B1*

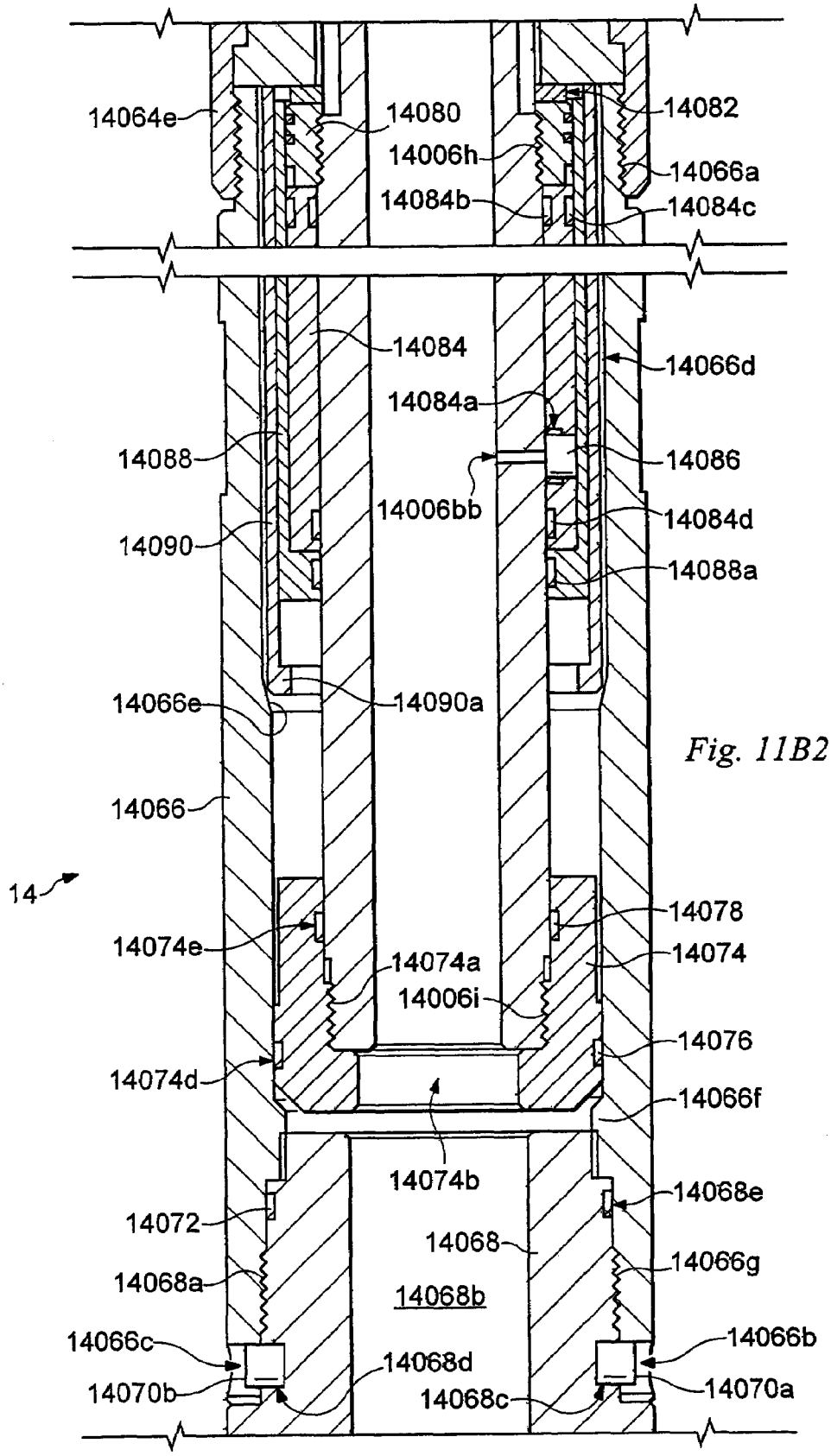
*Fig. 11B2*

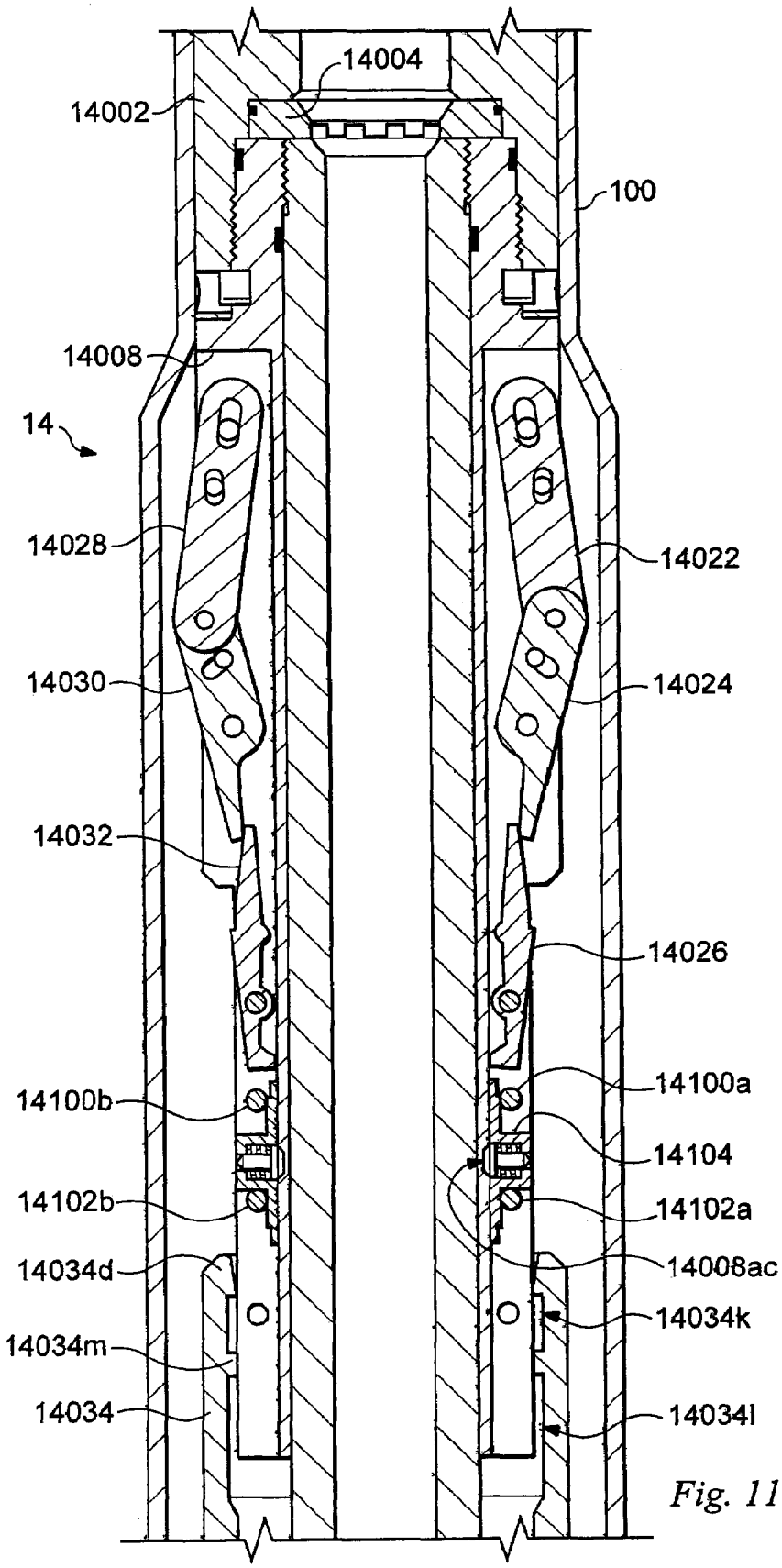
*Fig. 11Z1*

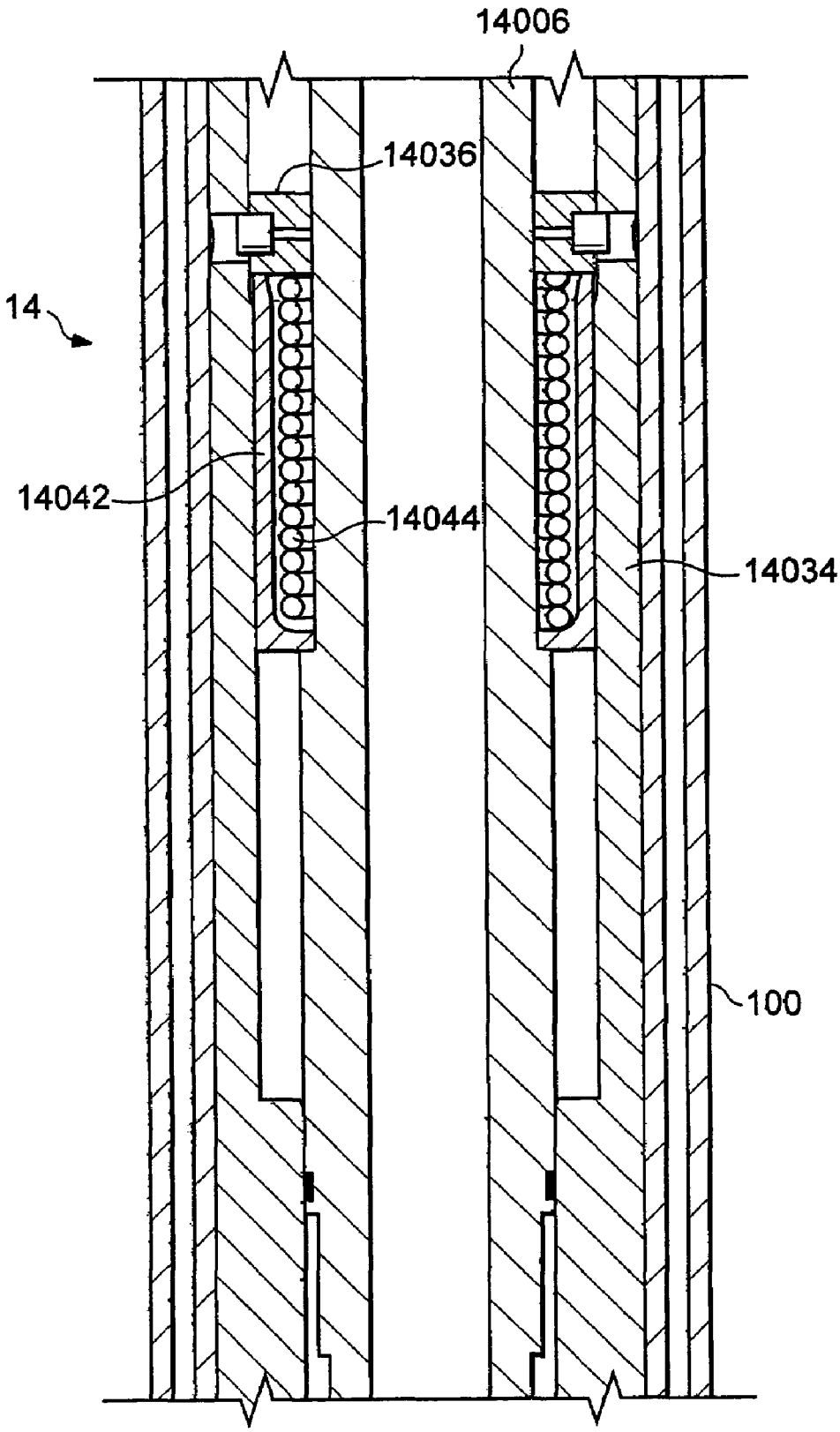
*Fig. 11Z2*

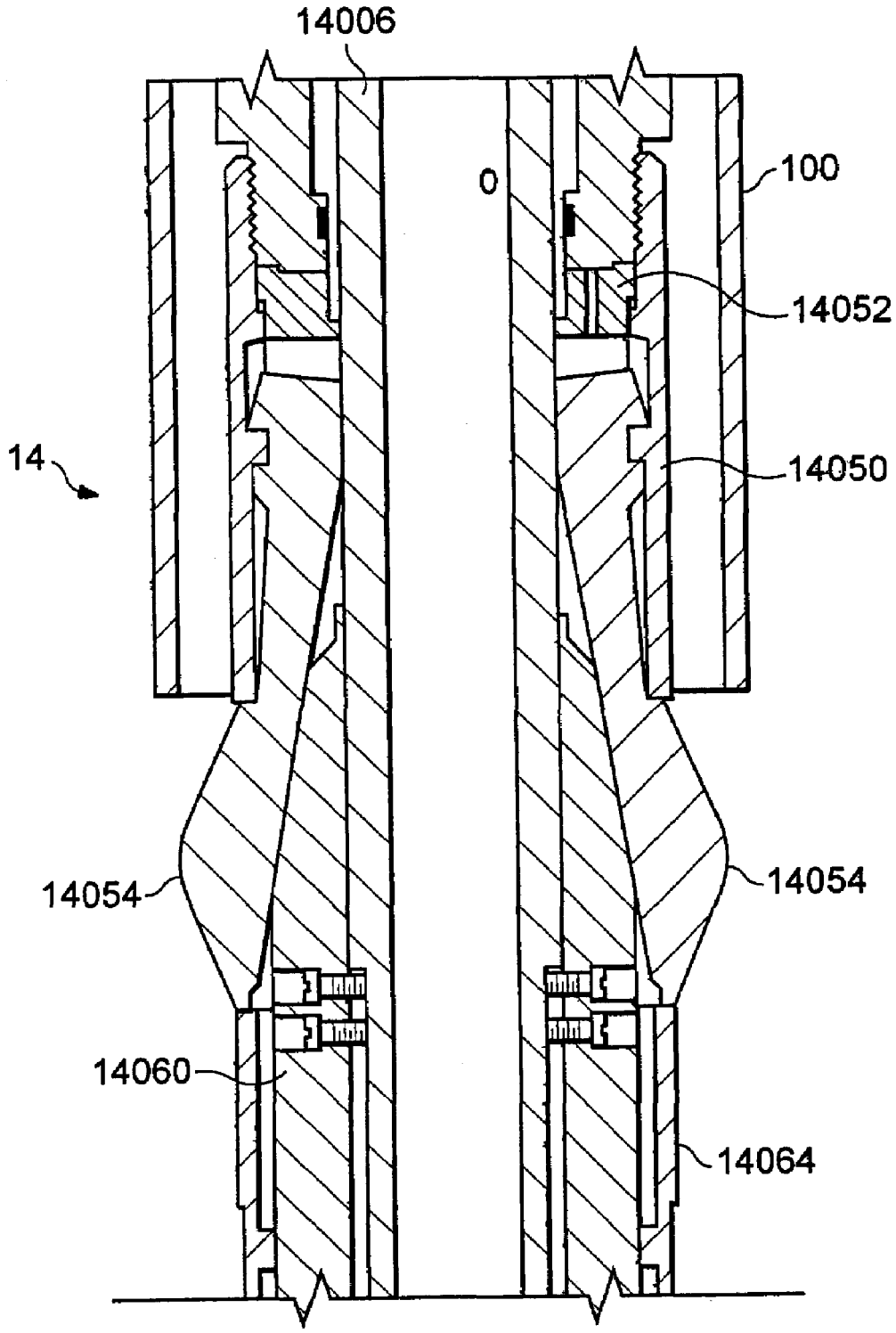
*Fig. 11Z3*

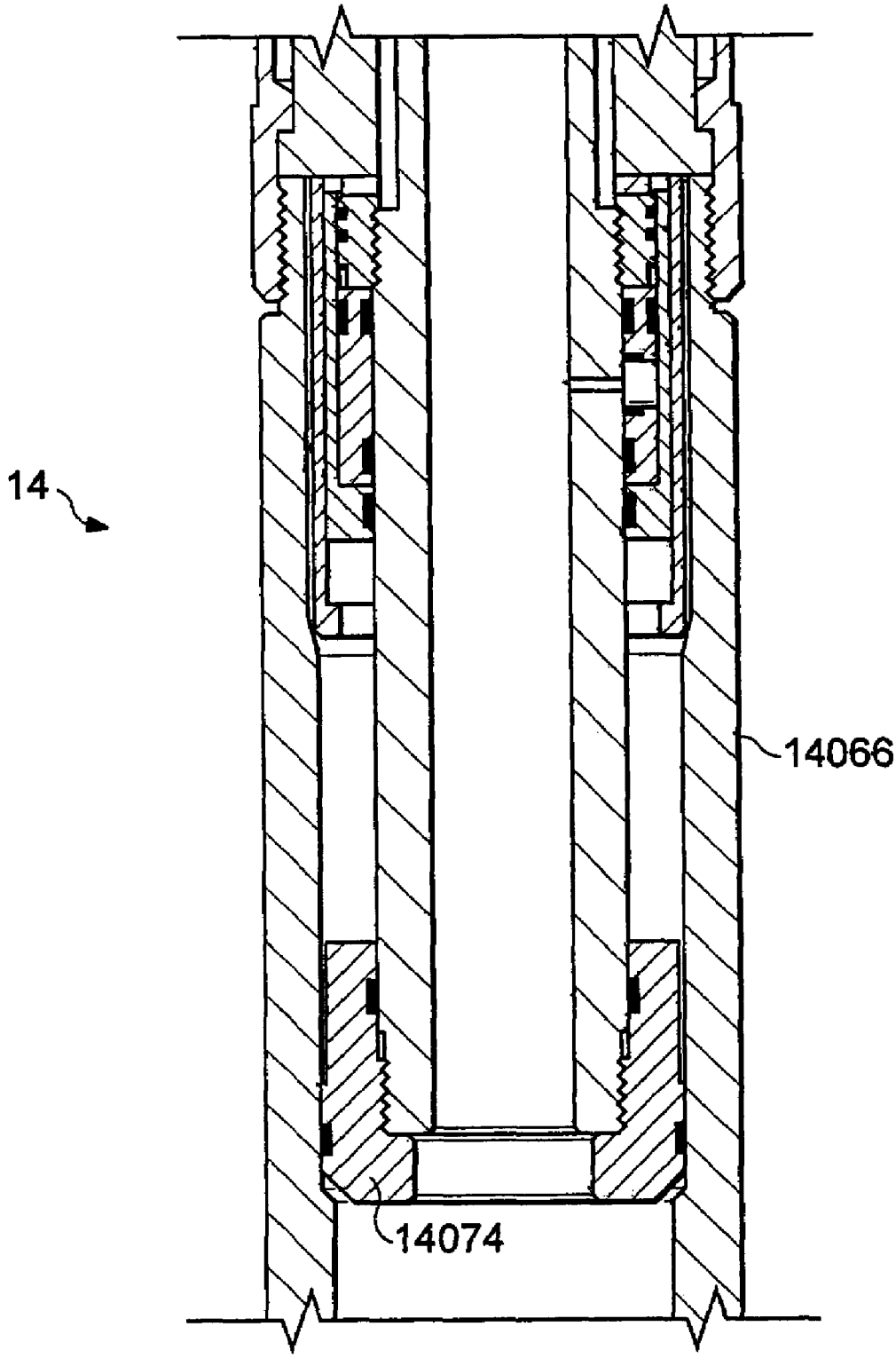
*Fig. 11Z4*

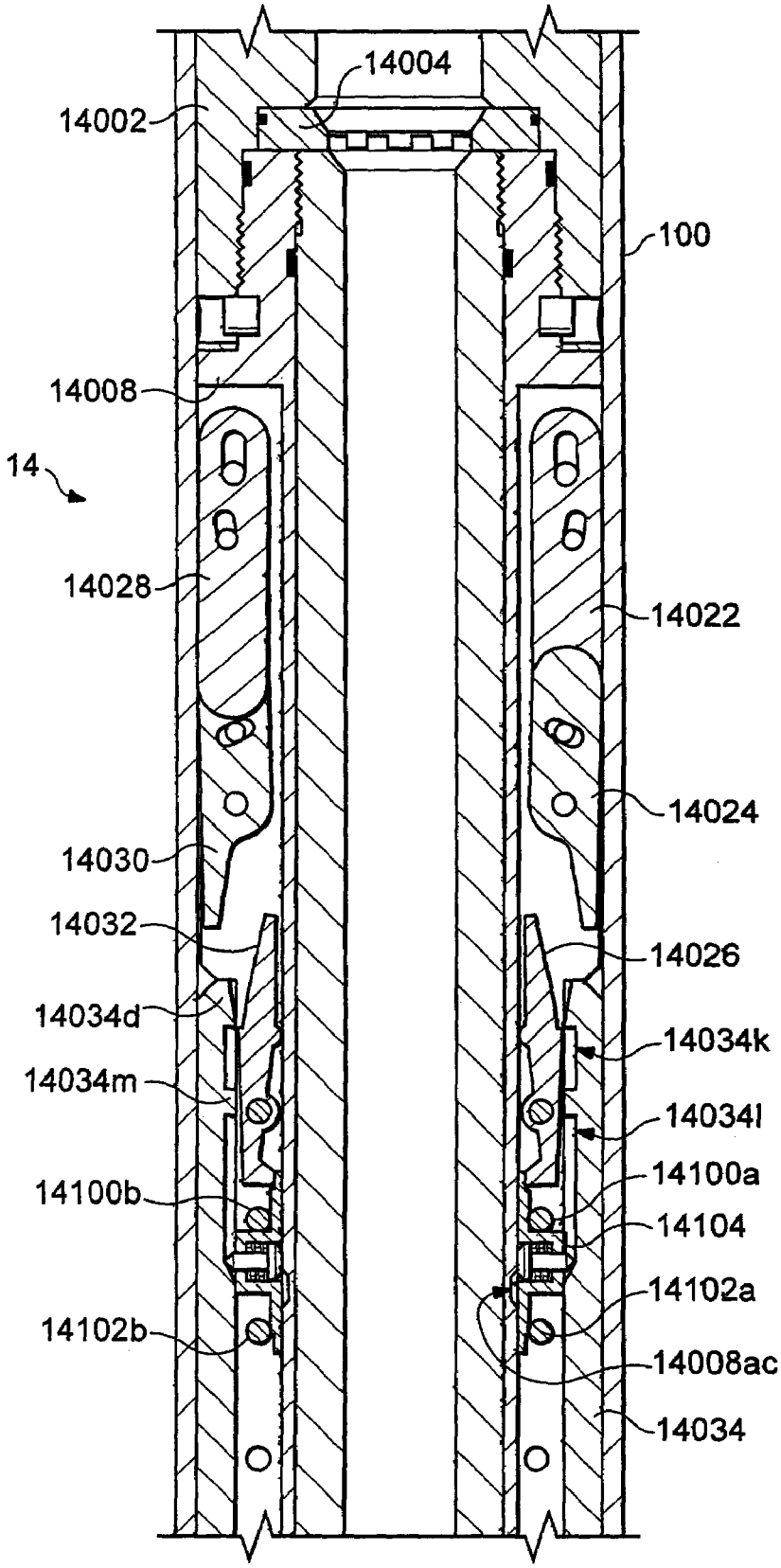
*Fig. 11AA1*

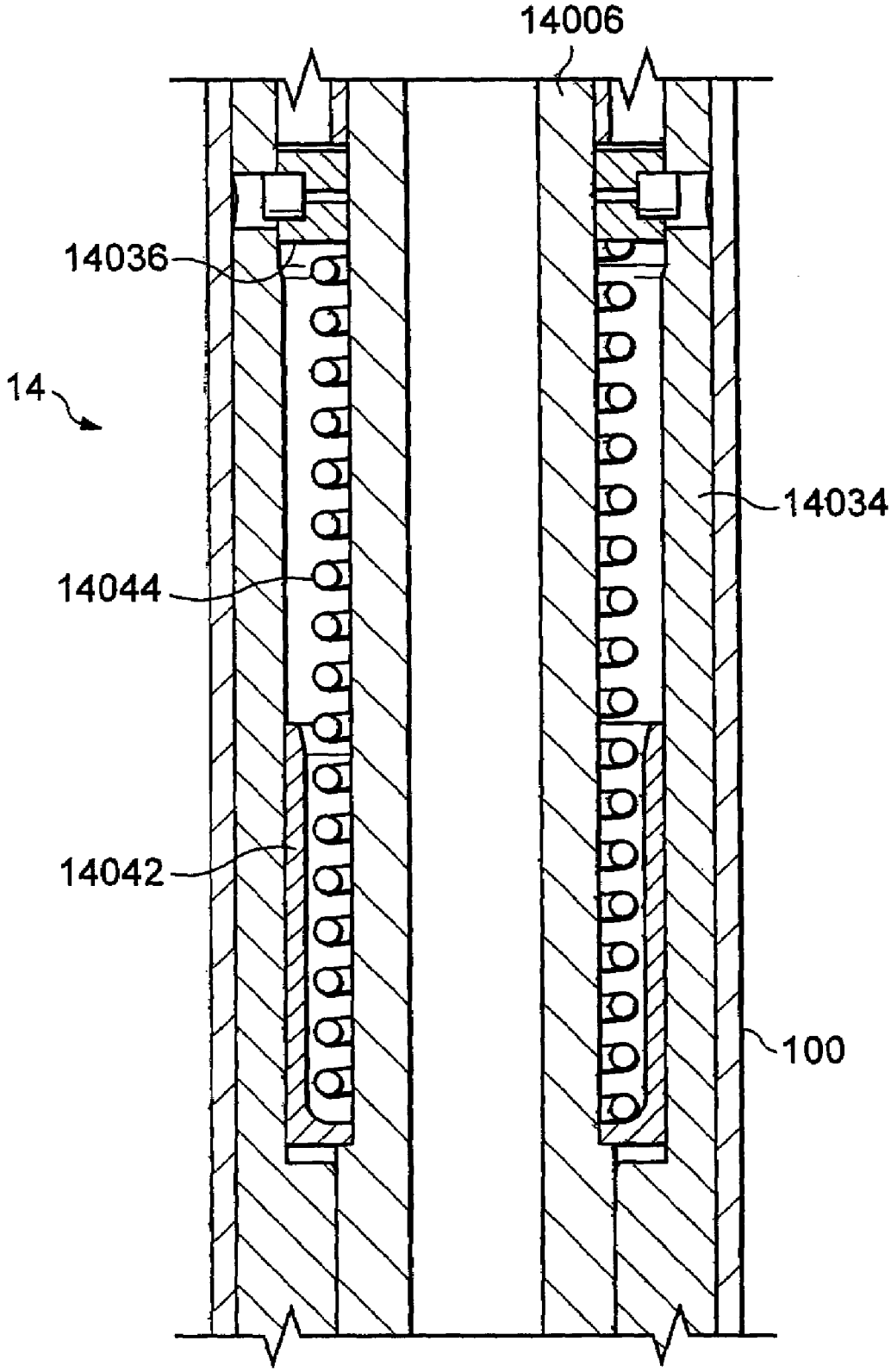
*Fig. 11AA2*

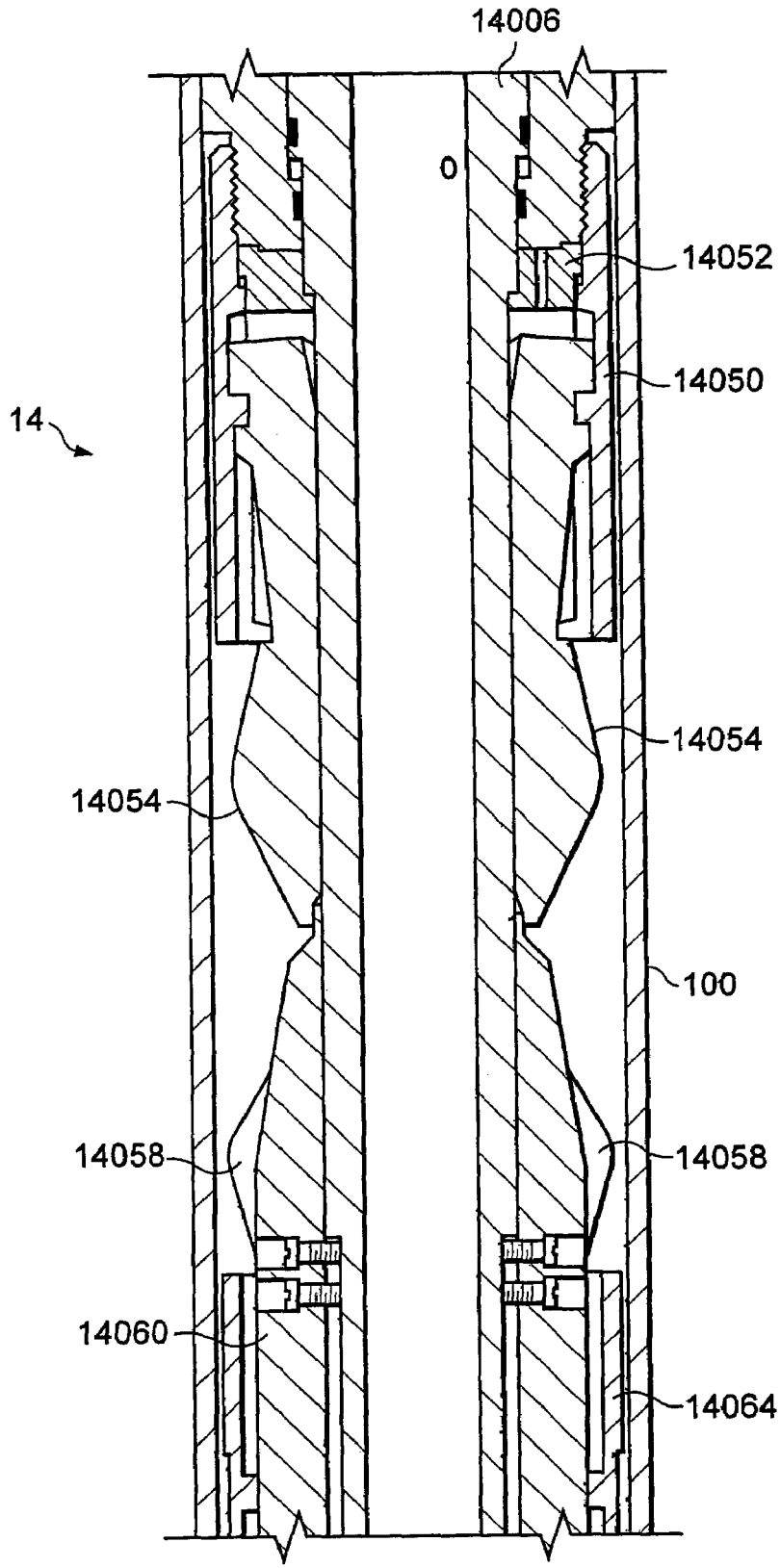
*Fig. 11AA3*

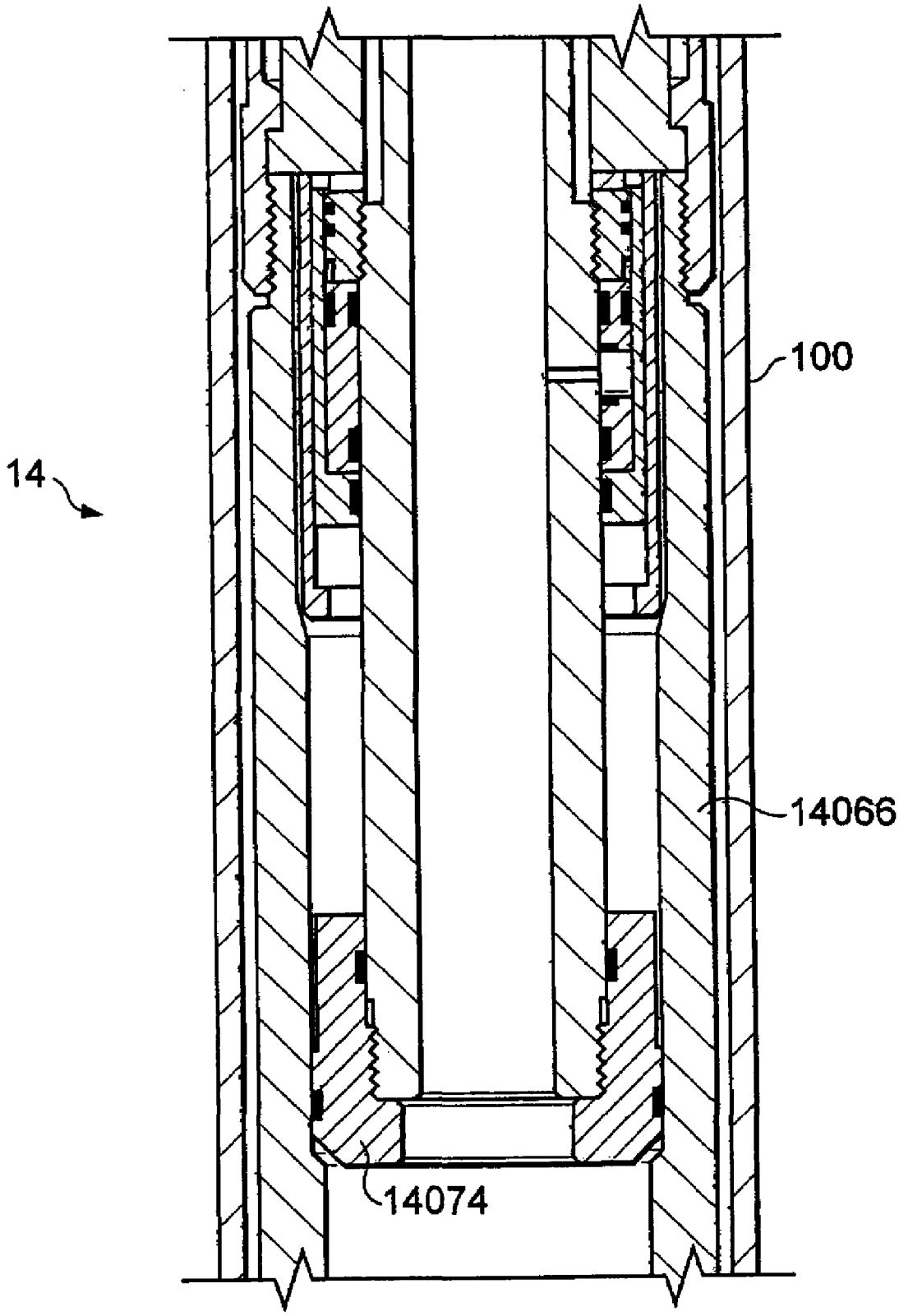
*Fig. 11AA4*

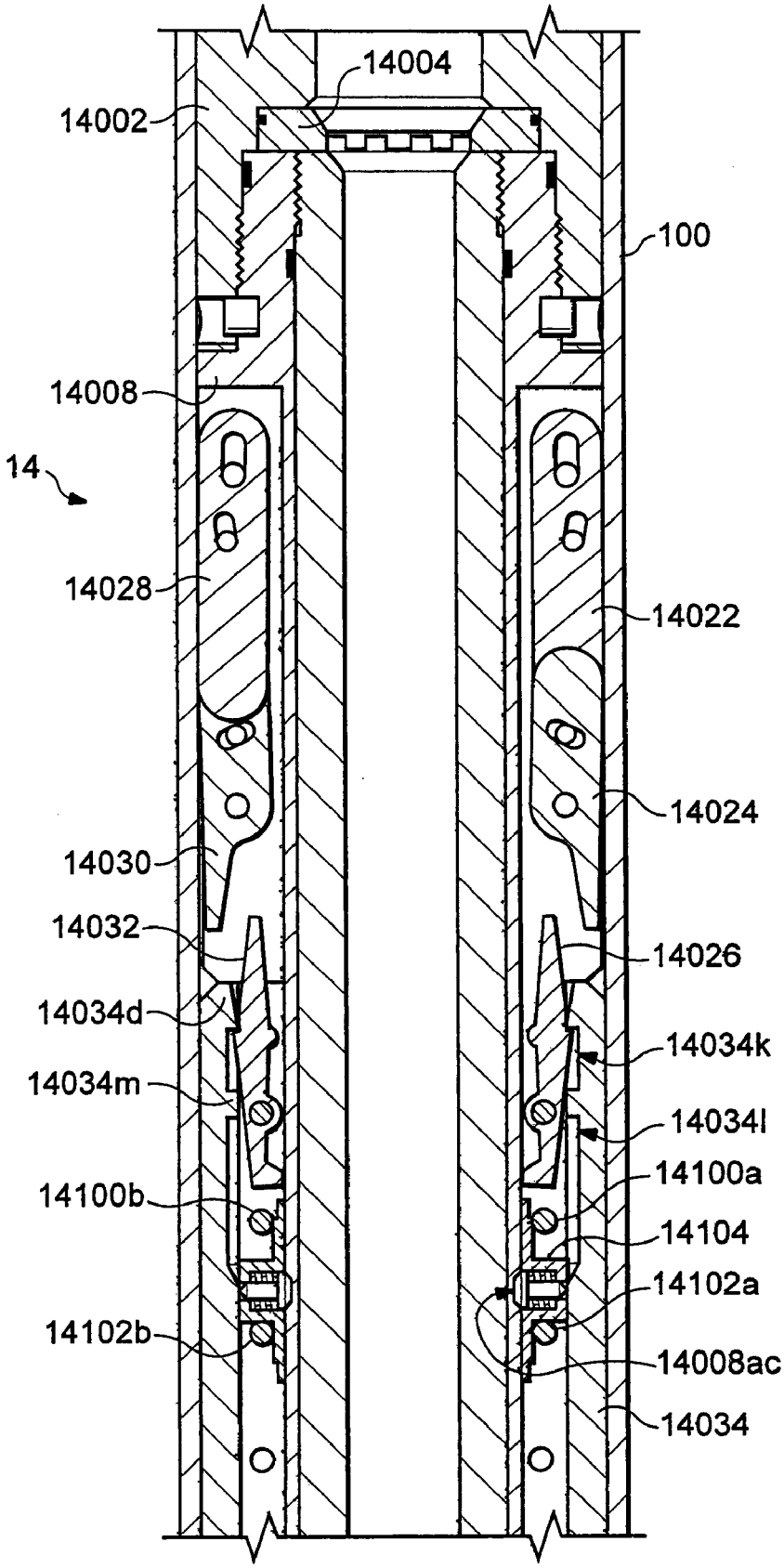
*Fig. 11AB1*

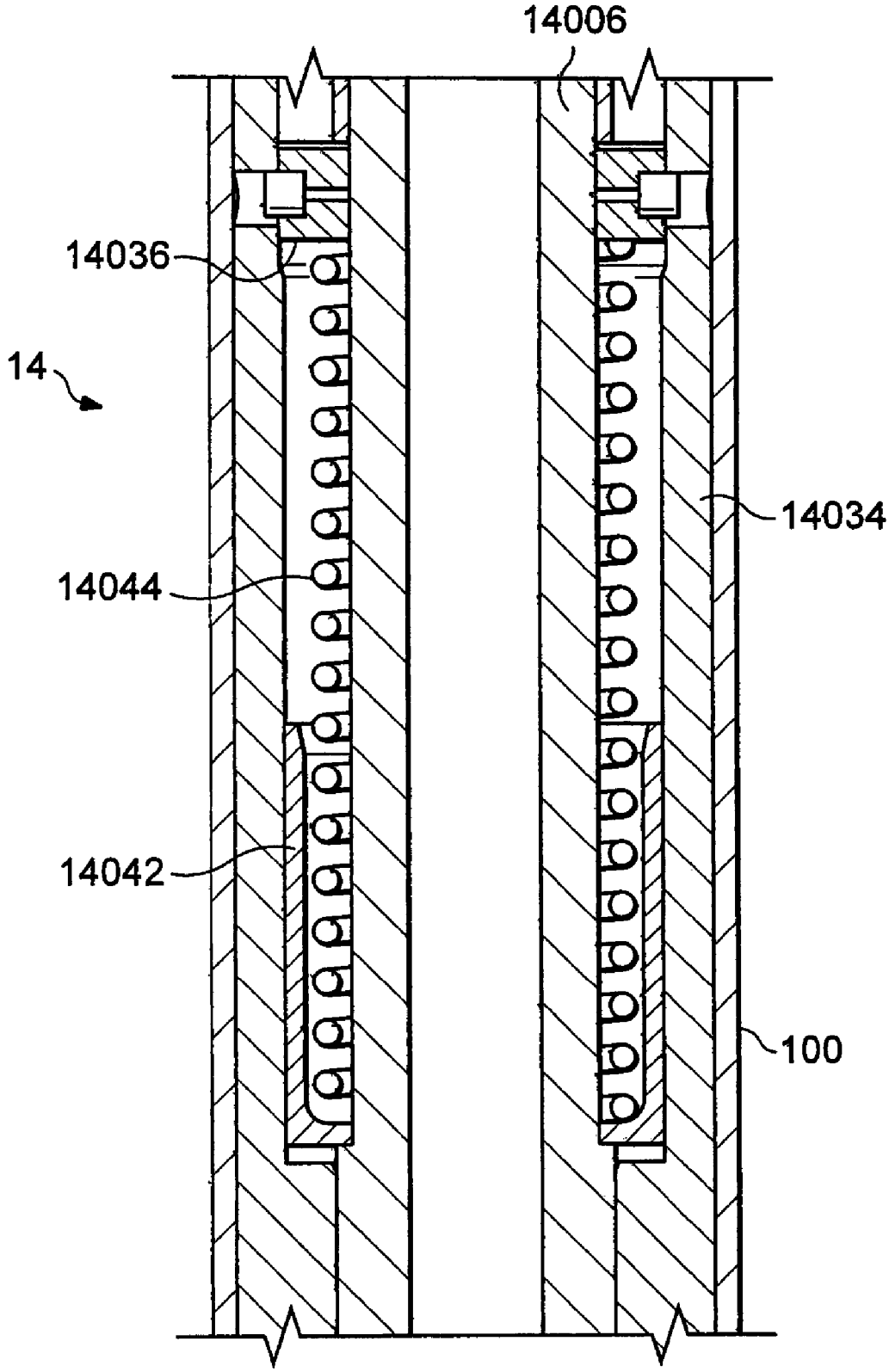
*Fig. 11AB2*

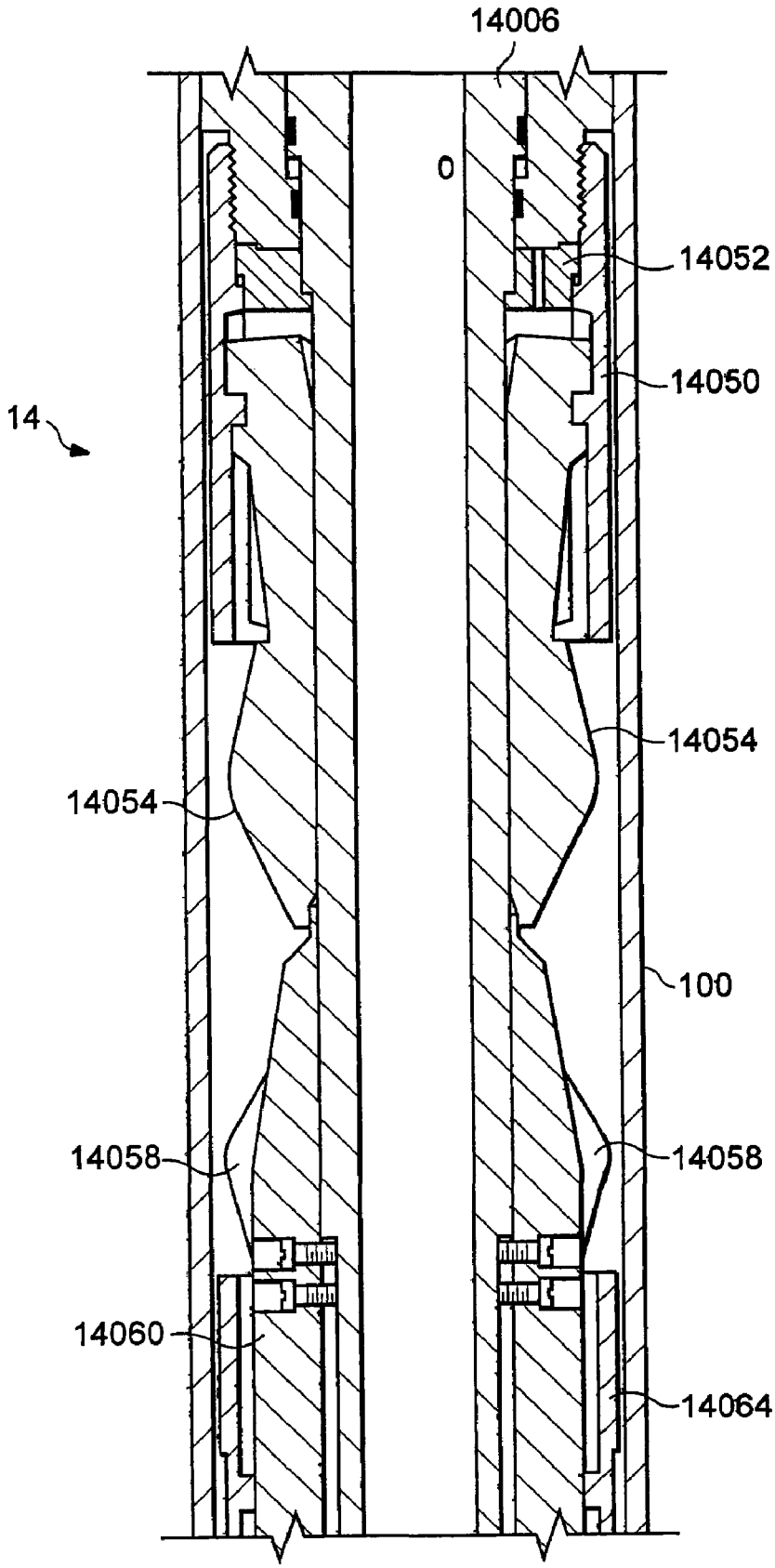
*Fig. 11AB3*

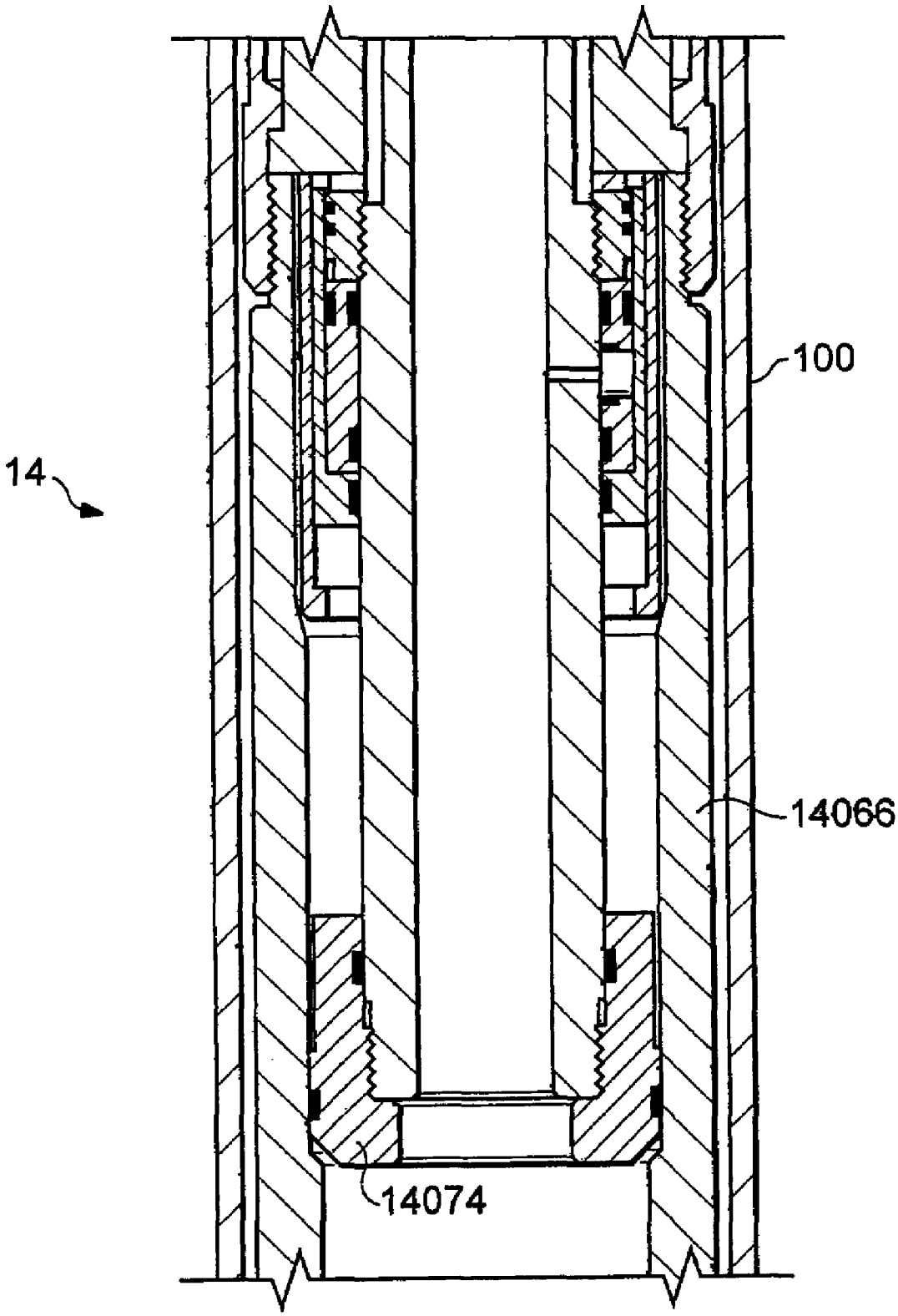
*Fig. 11AB4*

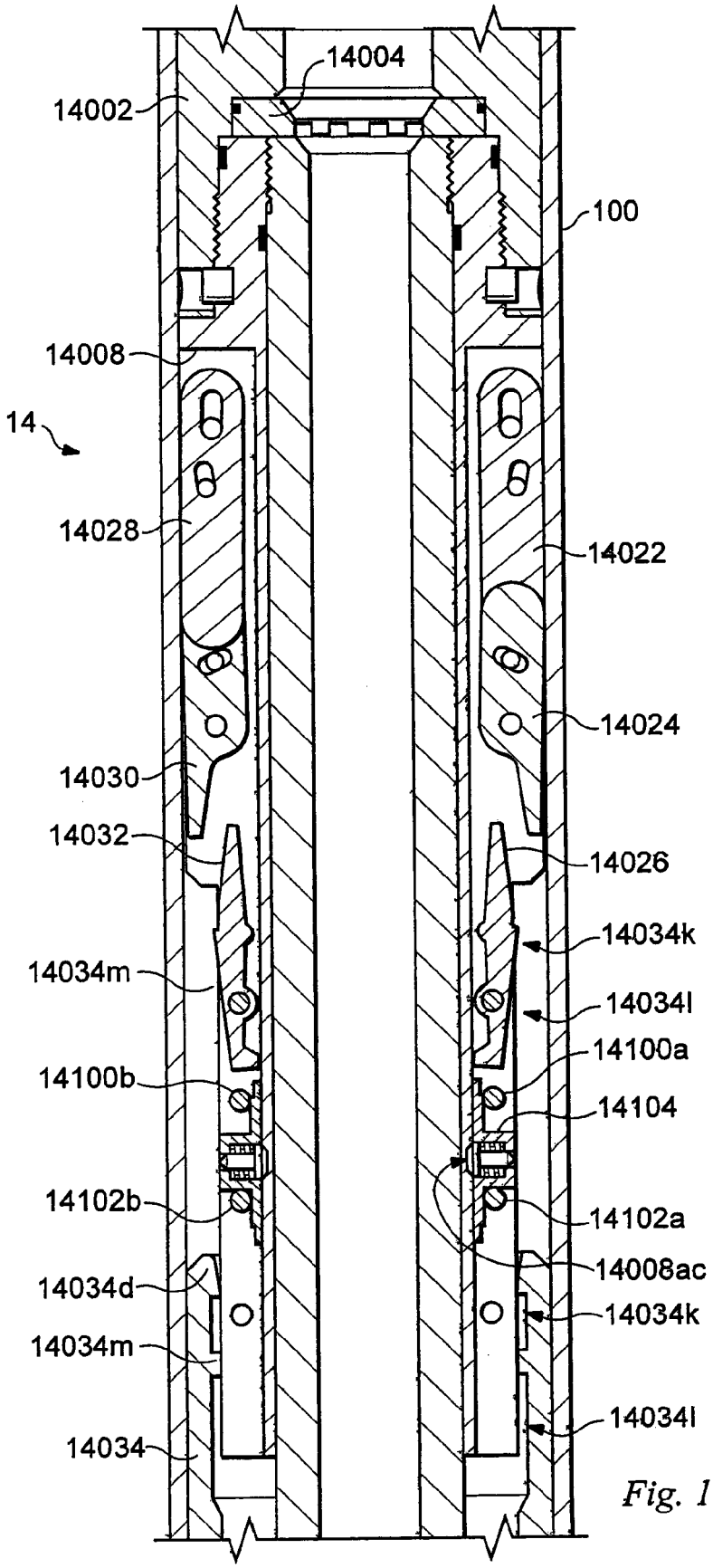
*Fig. 11AC1*

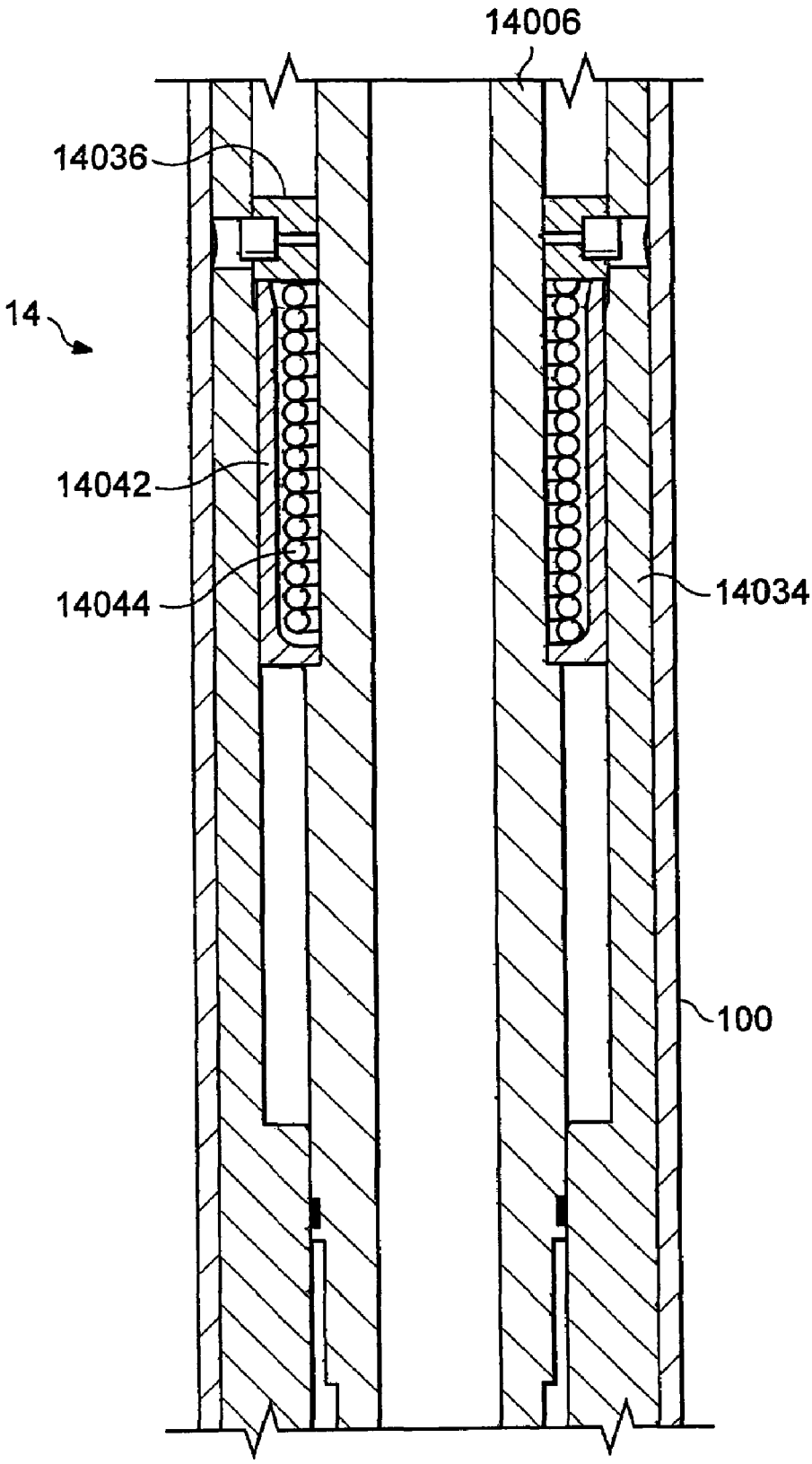
*Fig. 11AC2*

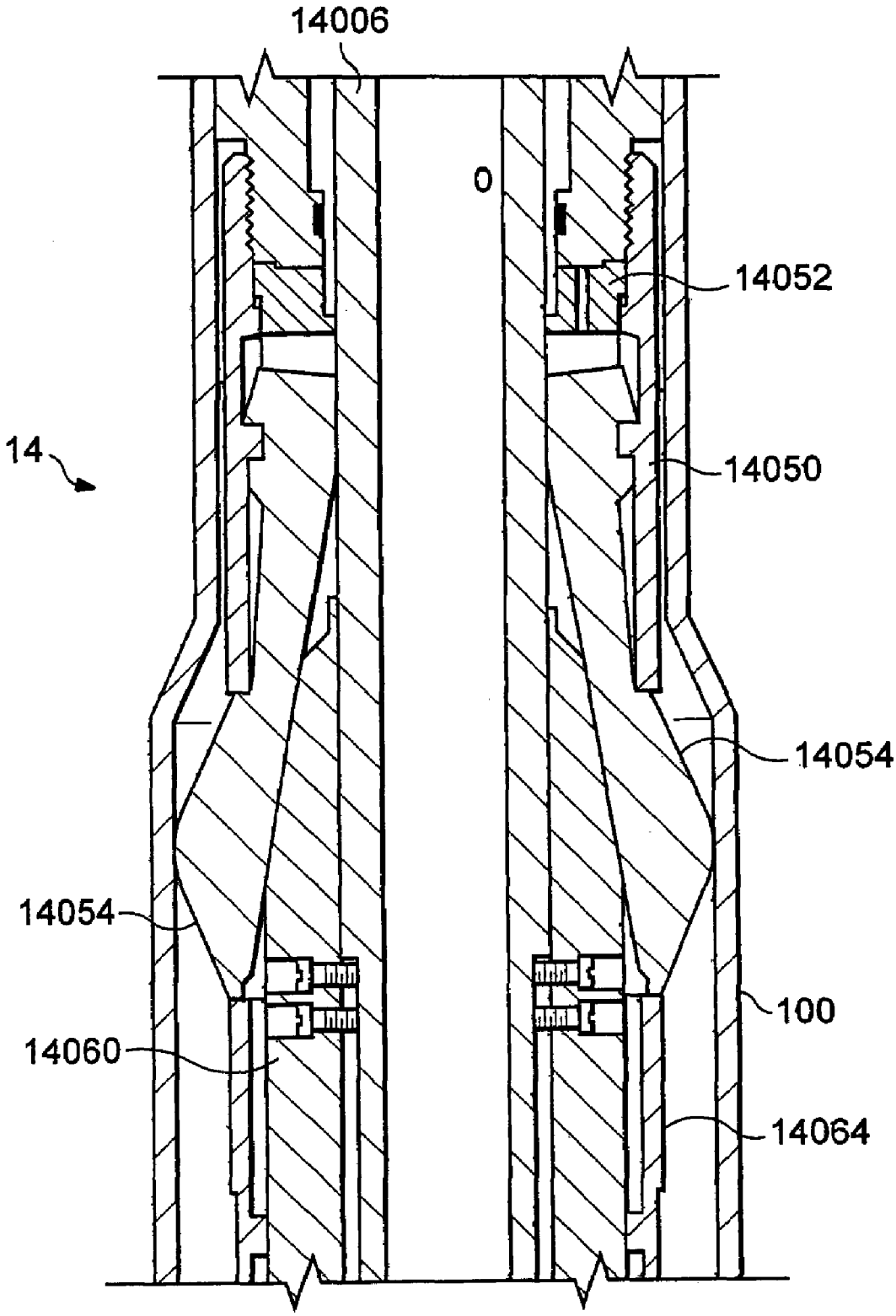
*Fig. 11AC3*

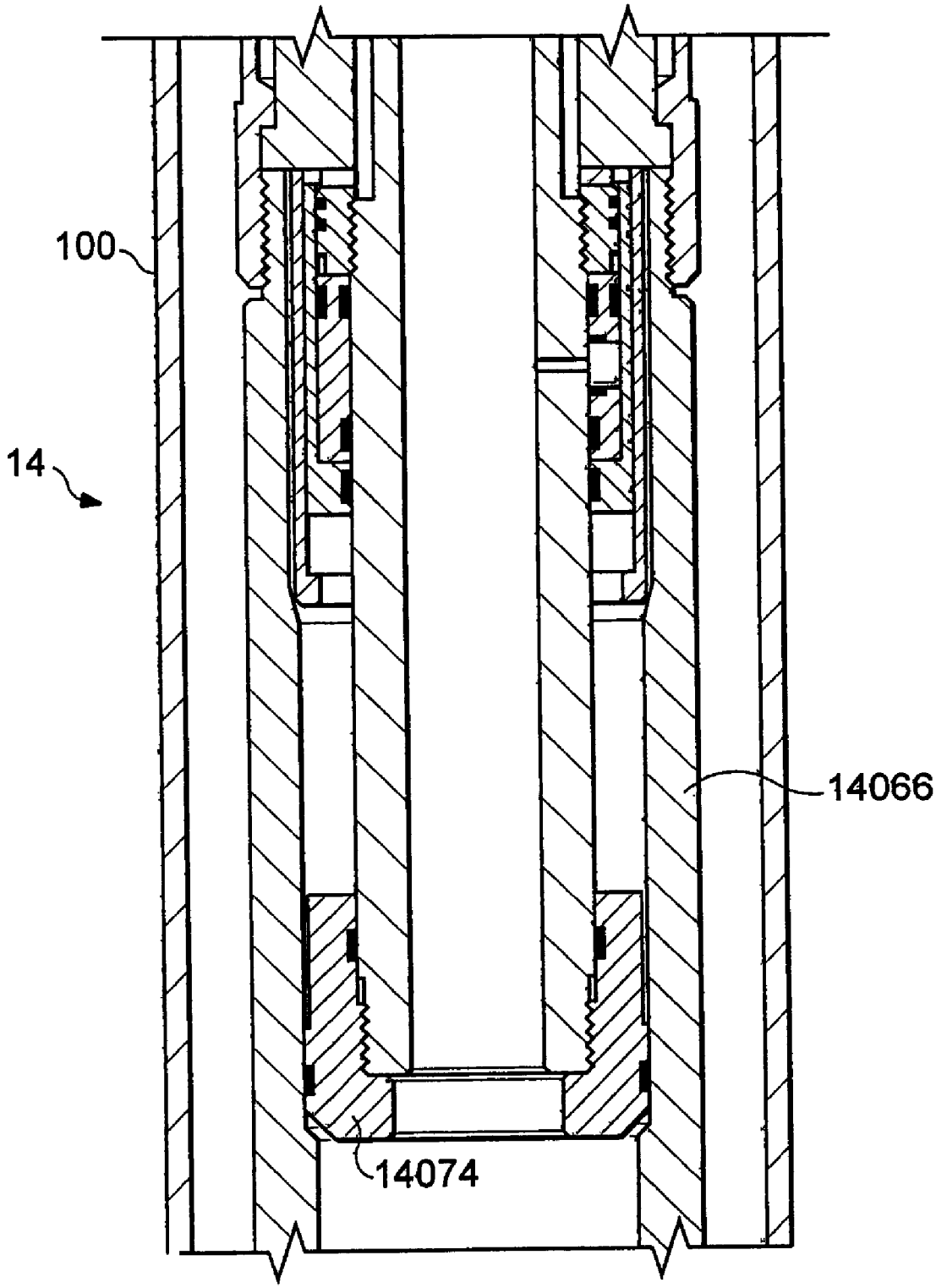
*Fig. 11AC4*

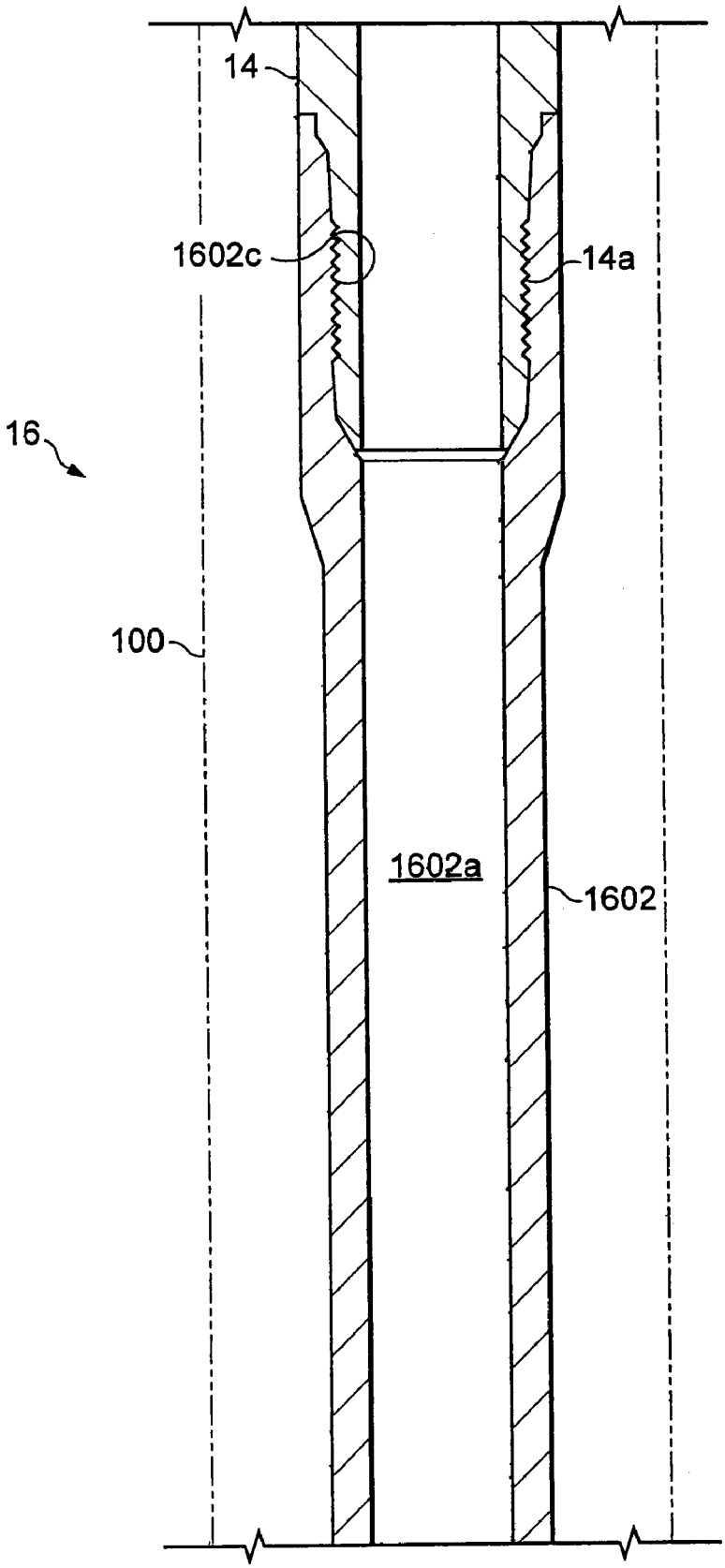
*Fig. 12A1*

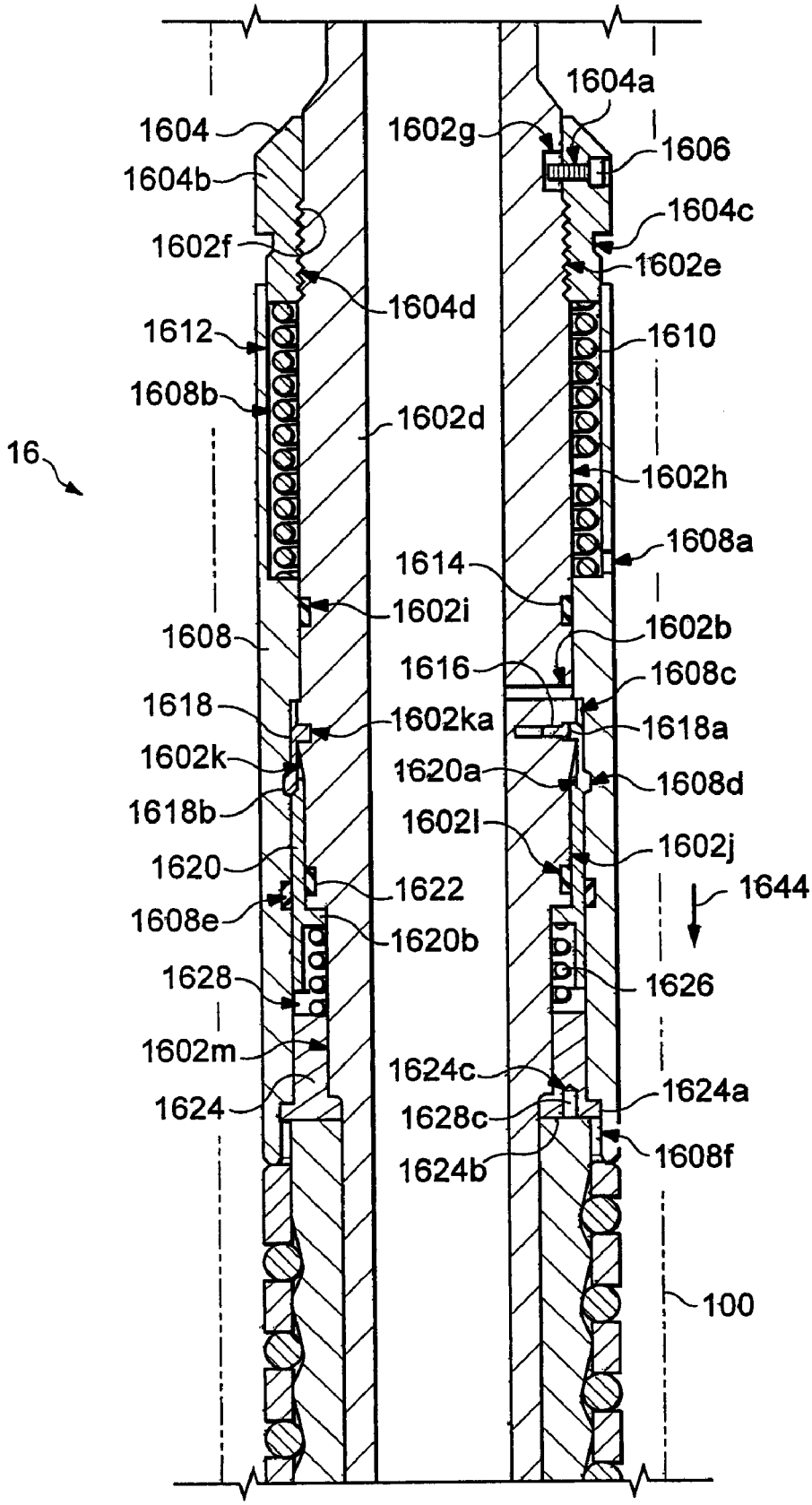
*Fig. 12A2*

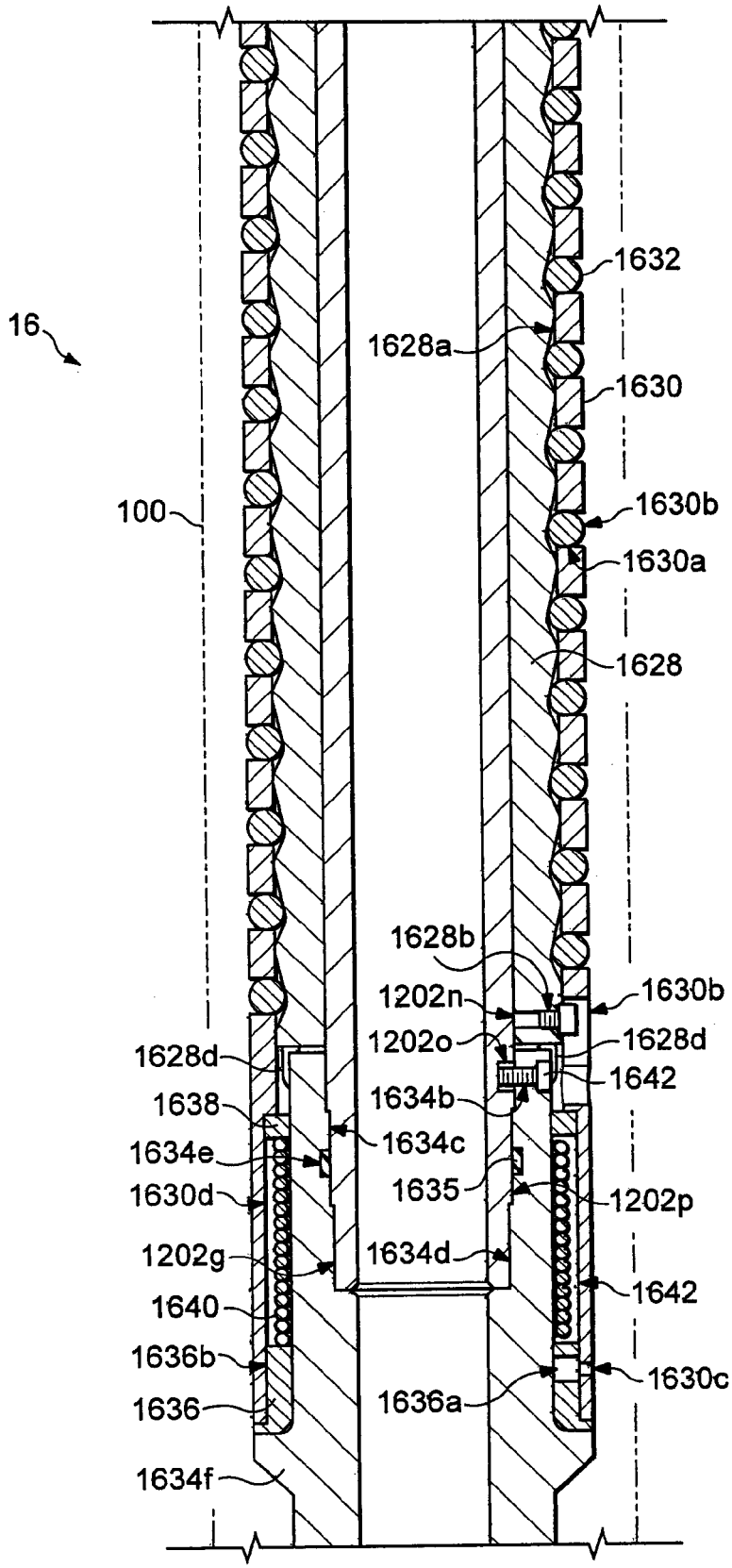
*Fig. 12A3*

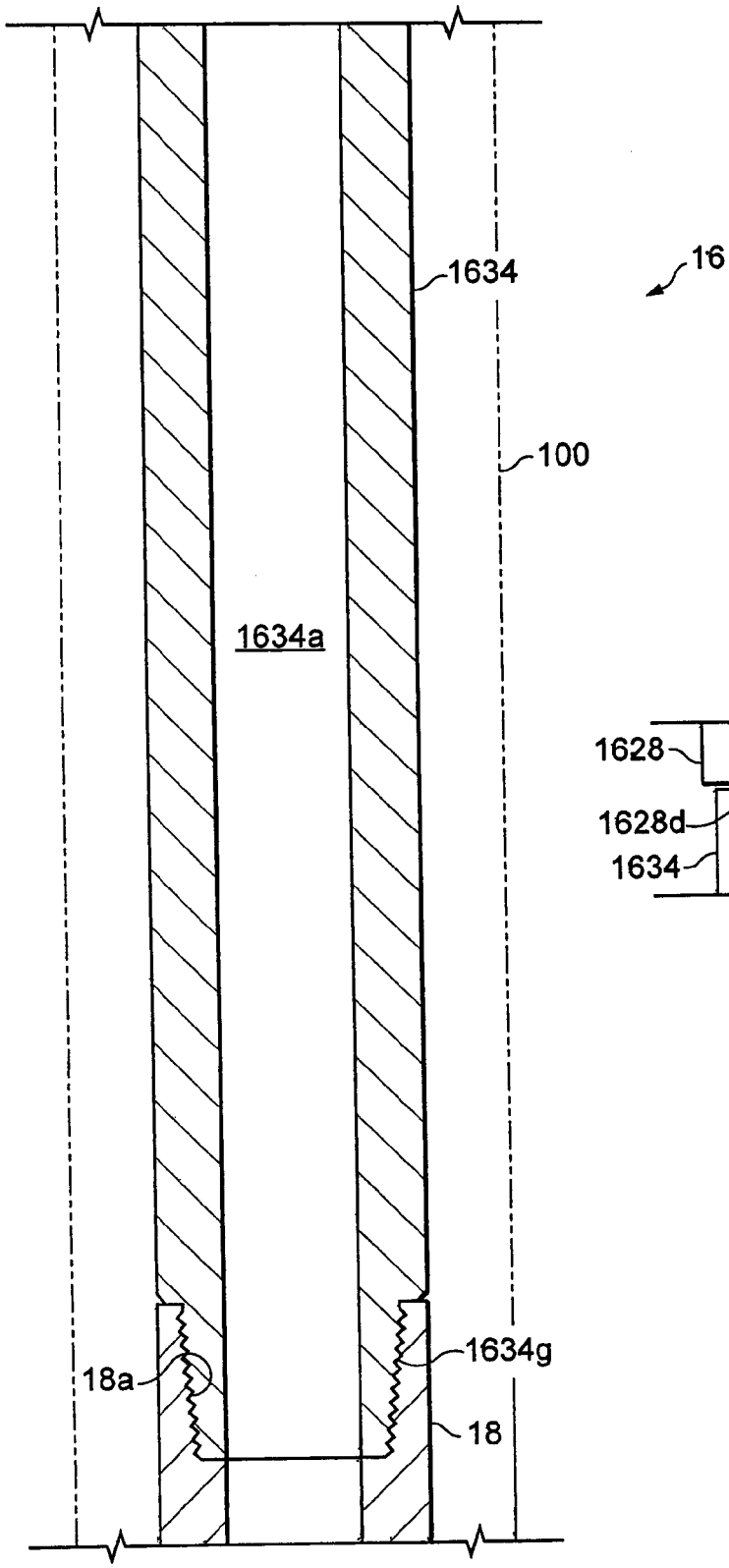
Fig. 12A4
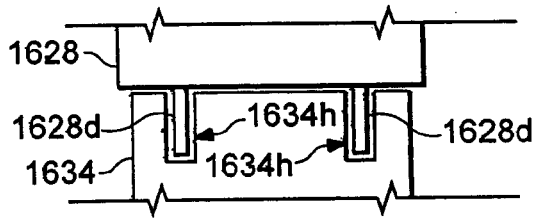
Fig. 12B

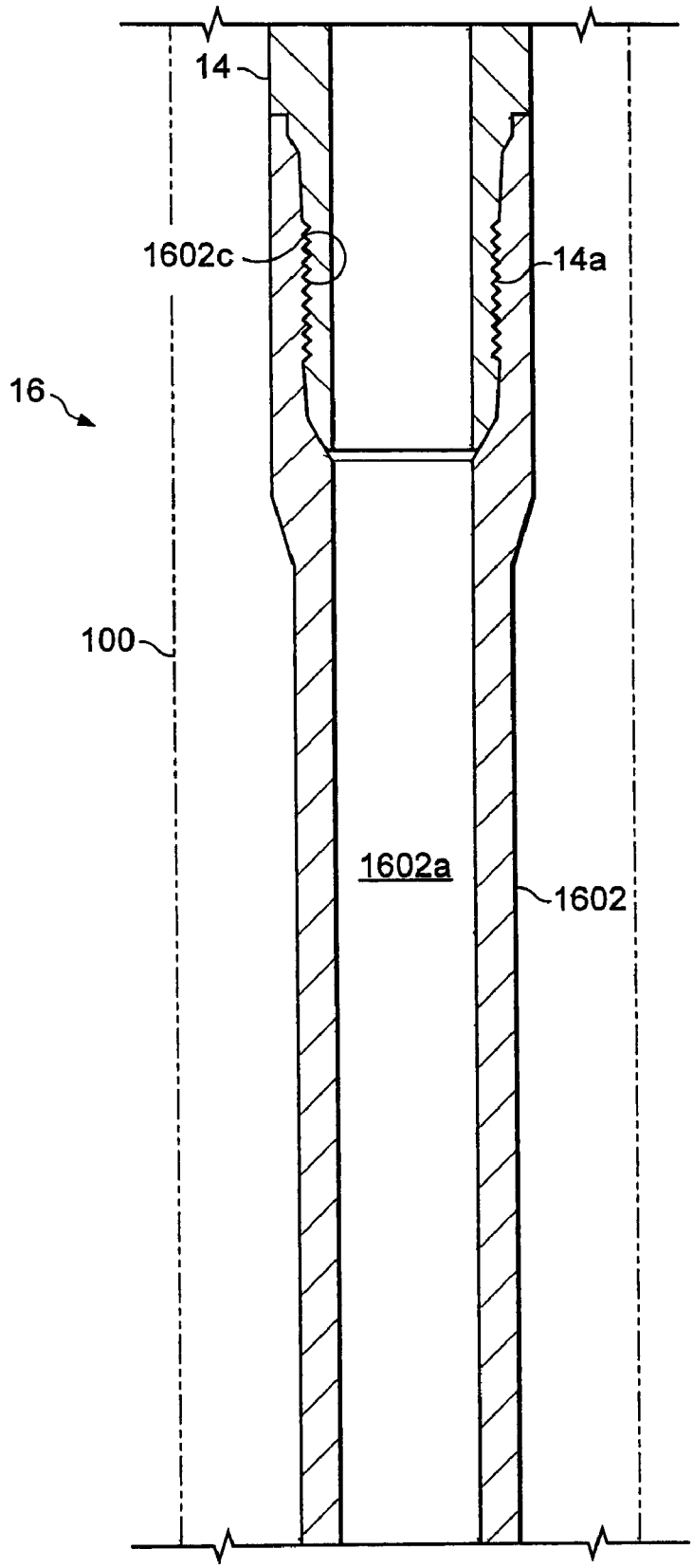
*Fig. 12C1*

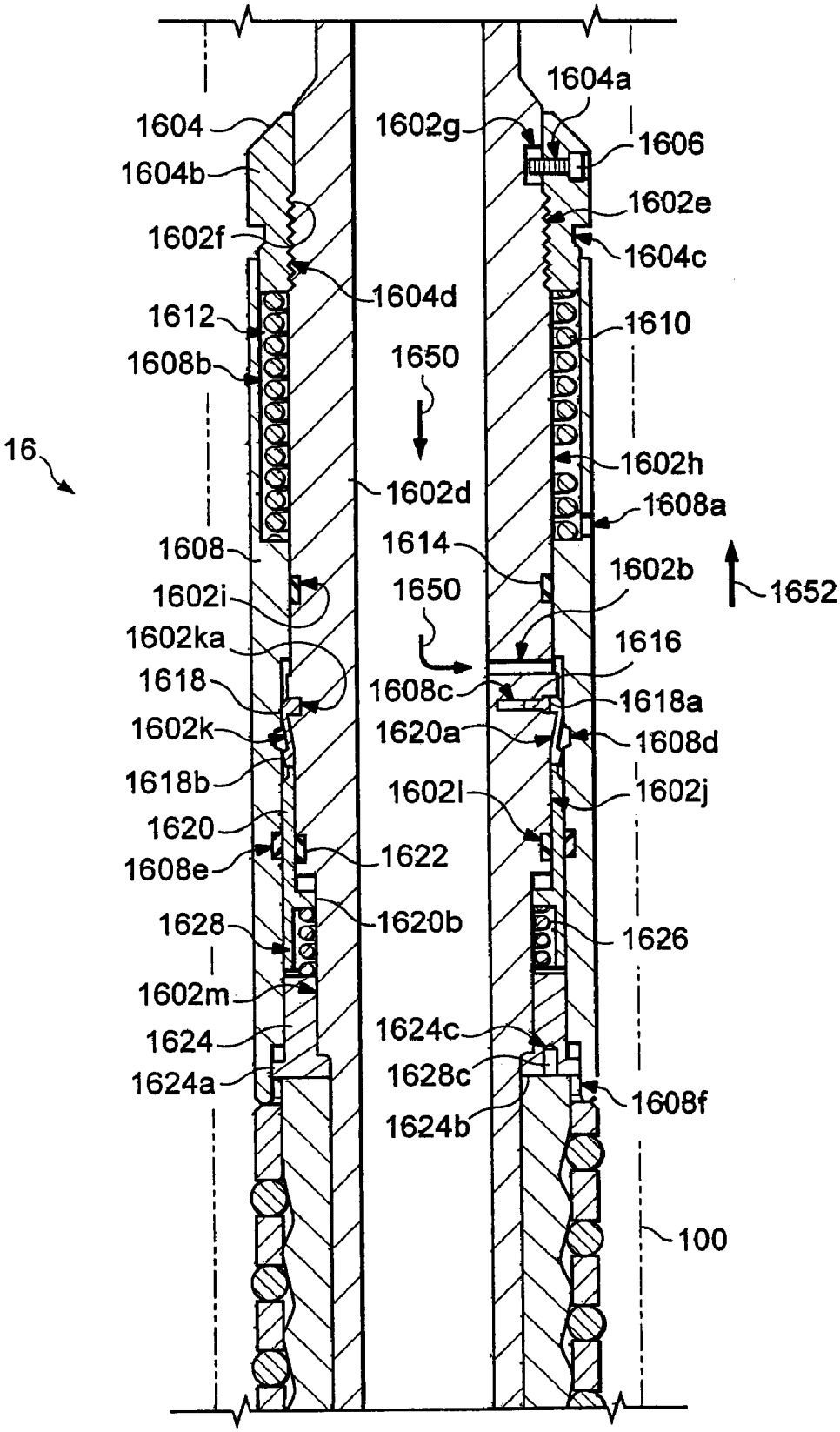
*Fig. 12C2*

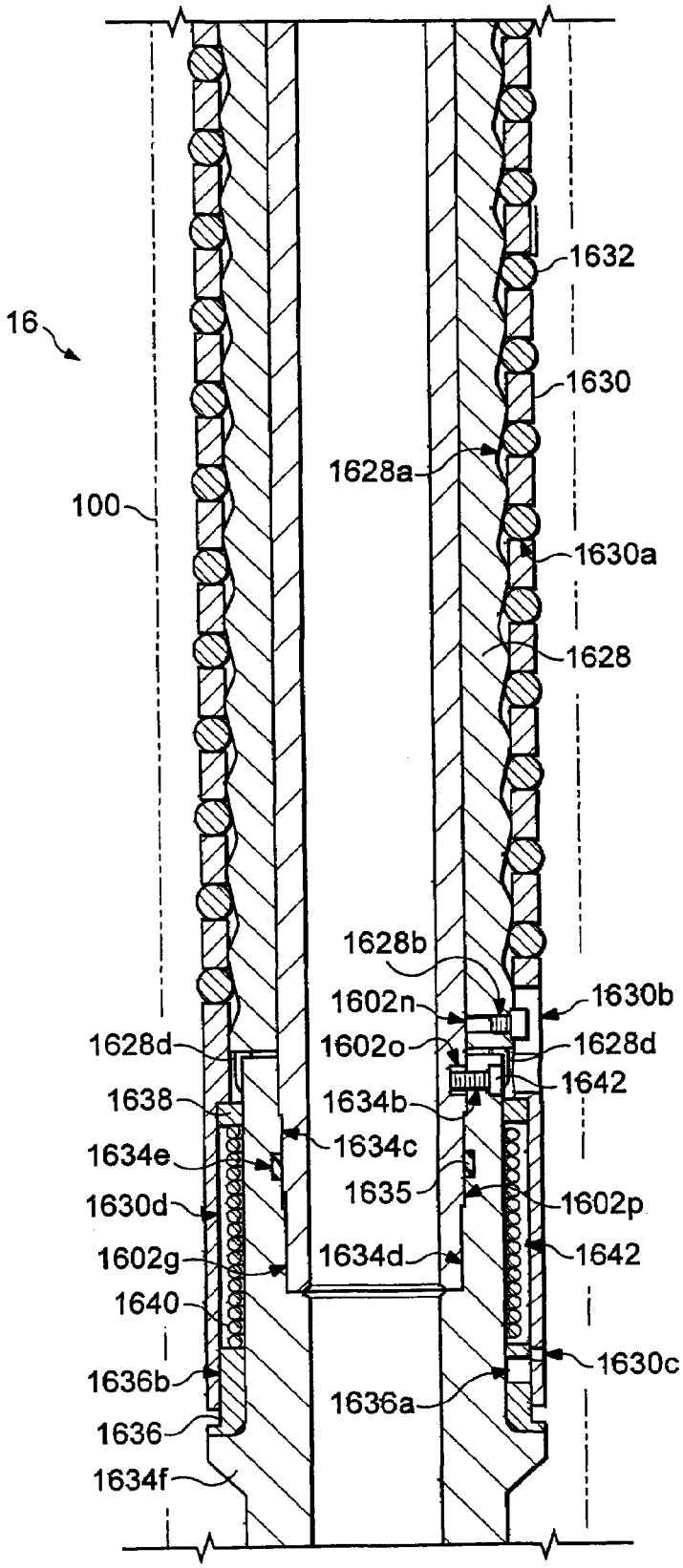
*Fig. 12C3*

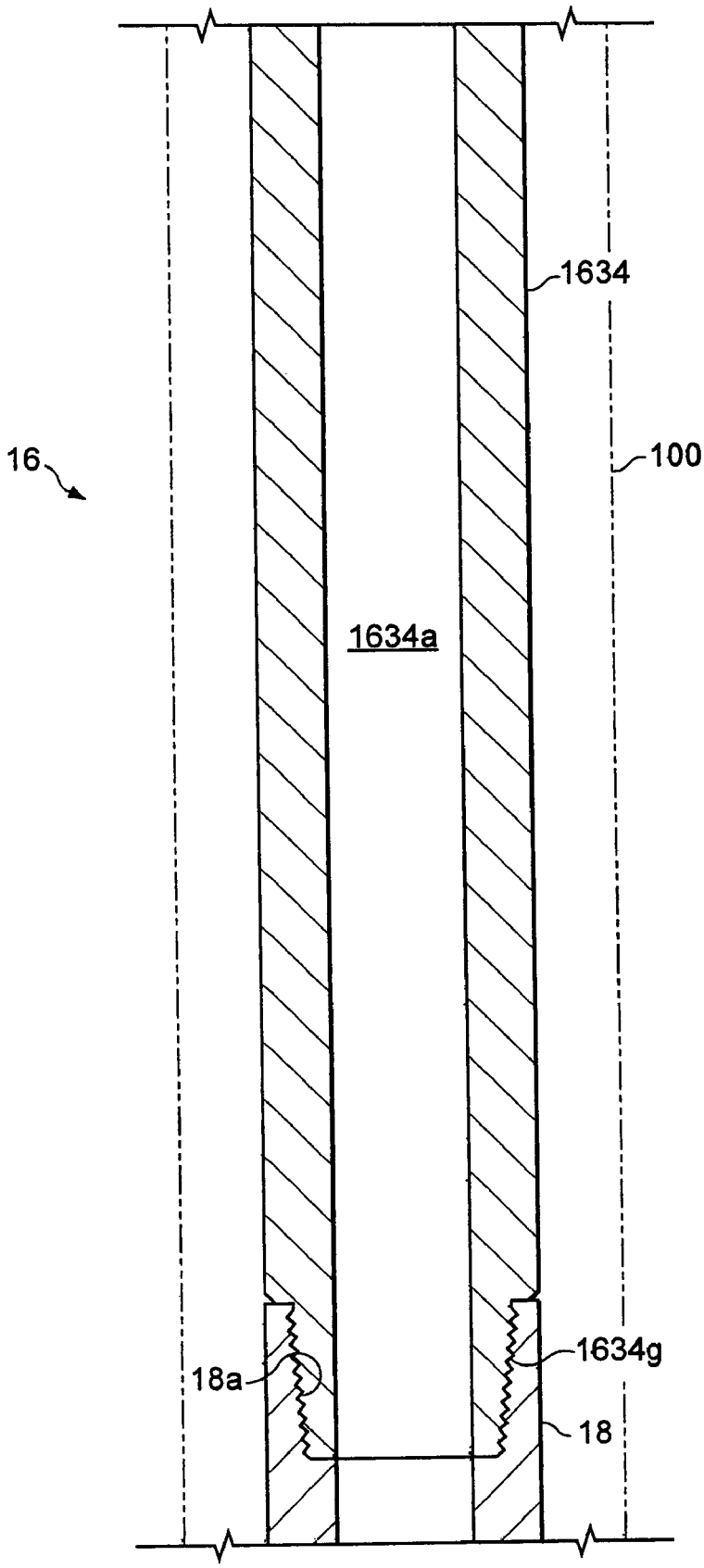
*Fig. 12C4*

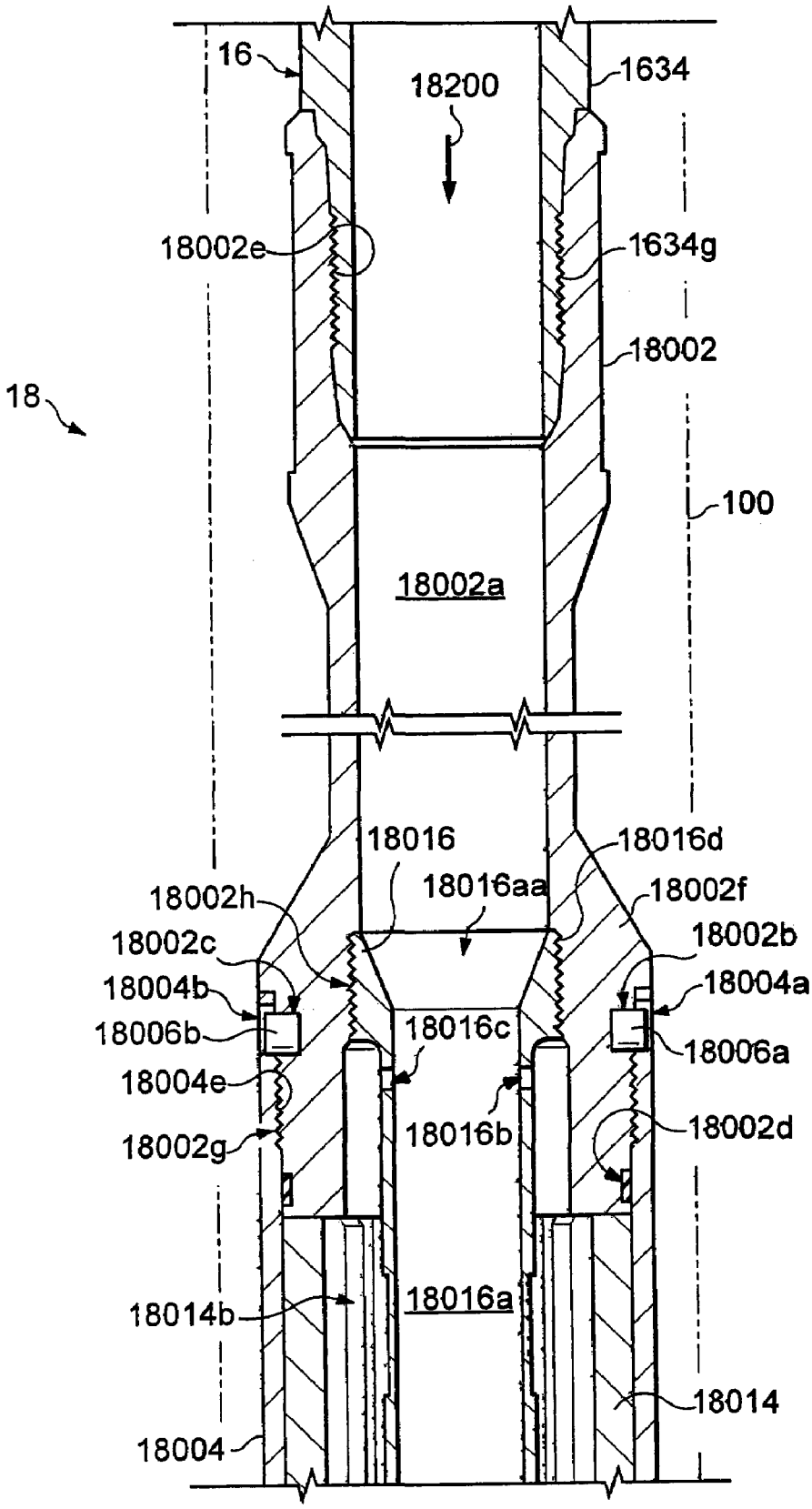
*Fig. 13A1*

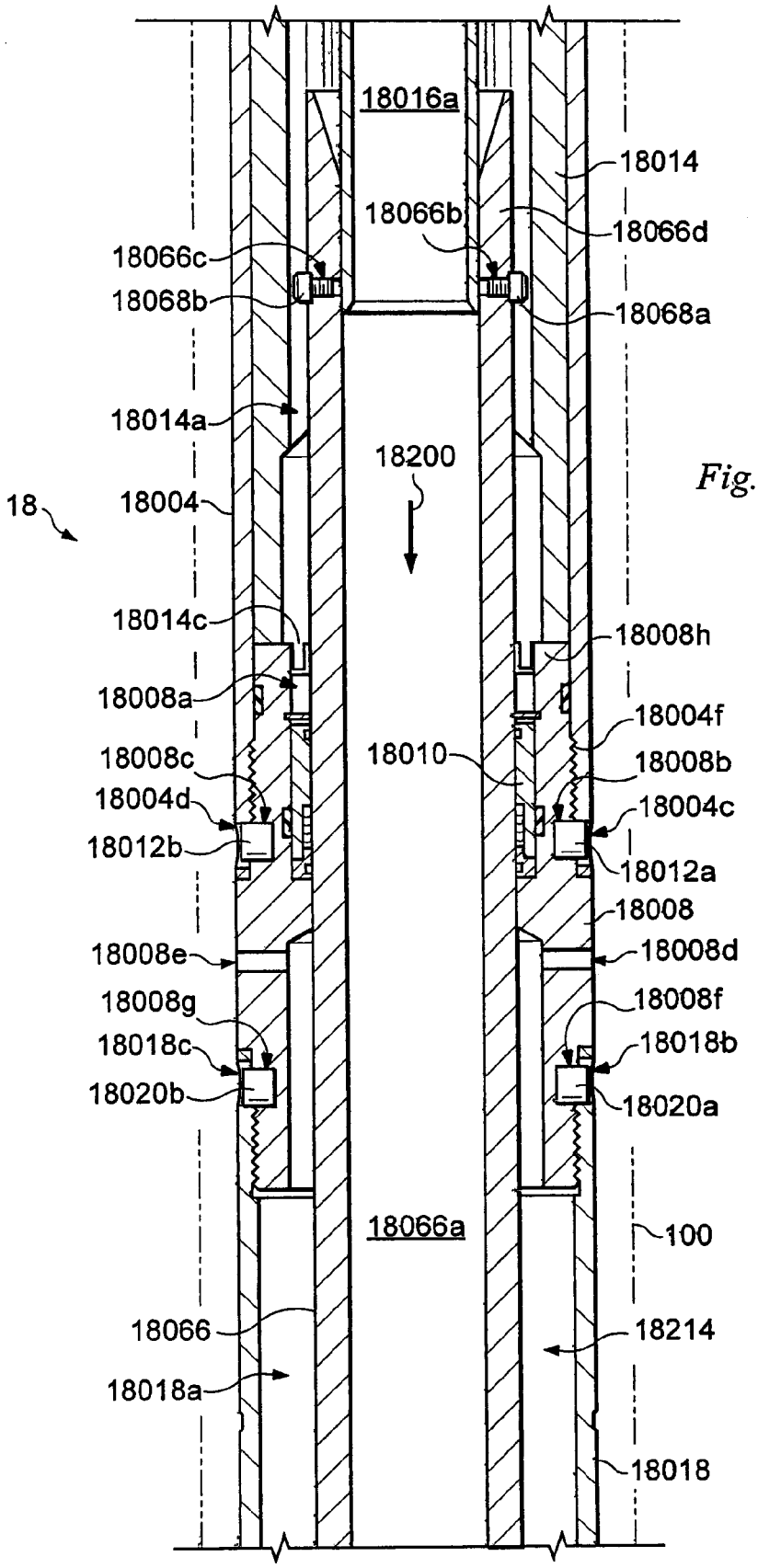
*Fig. 13A2*

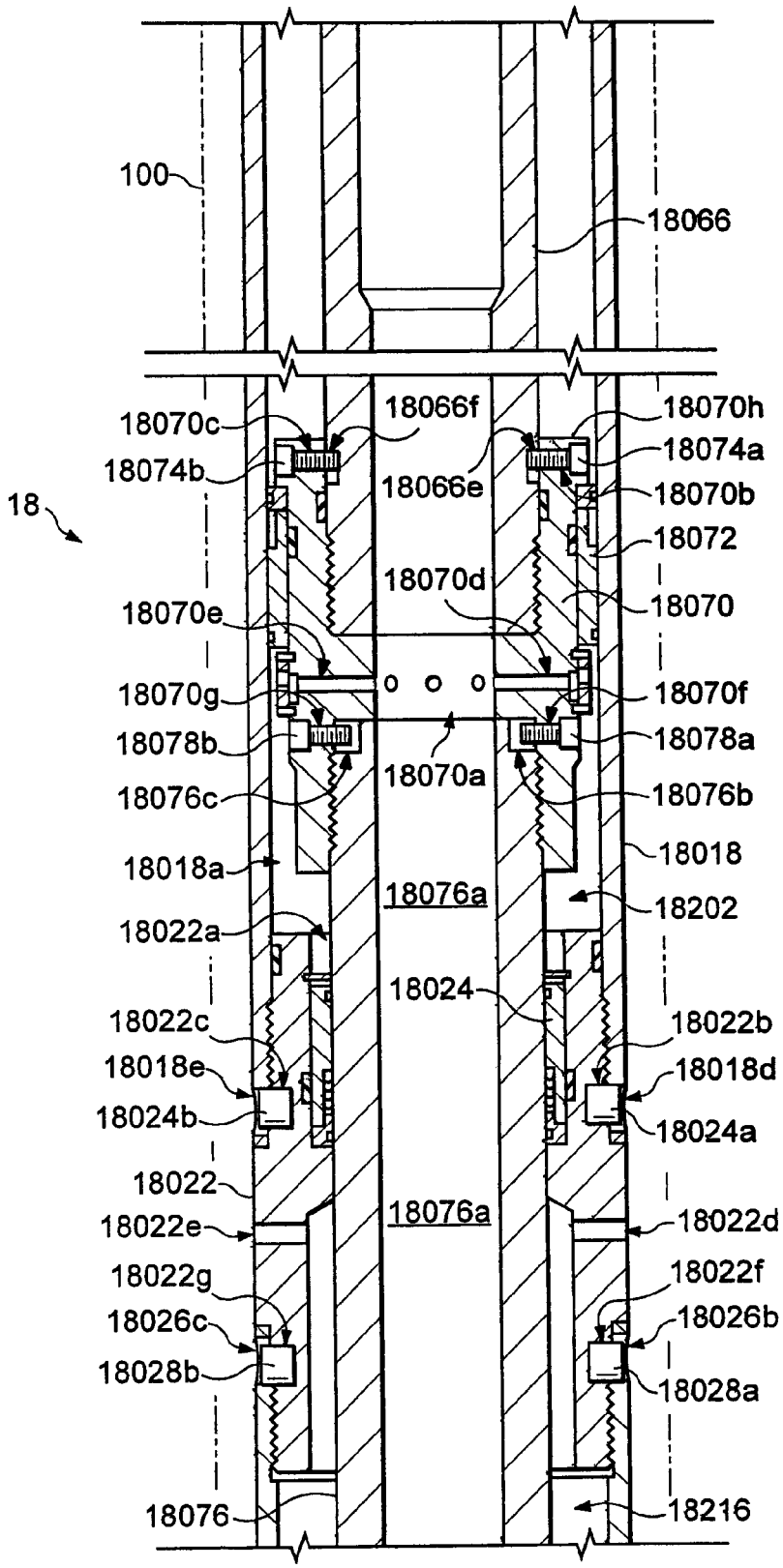
*Fig. 13A3*

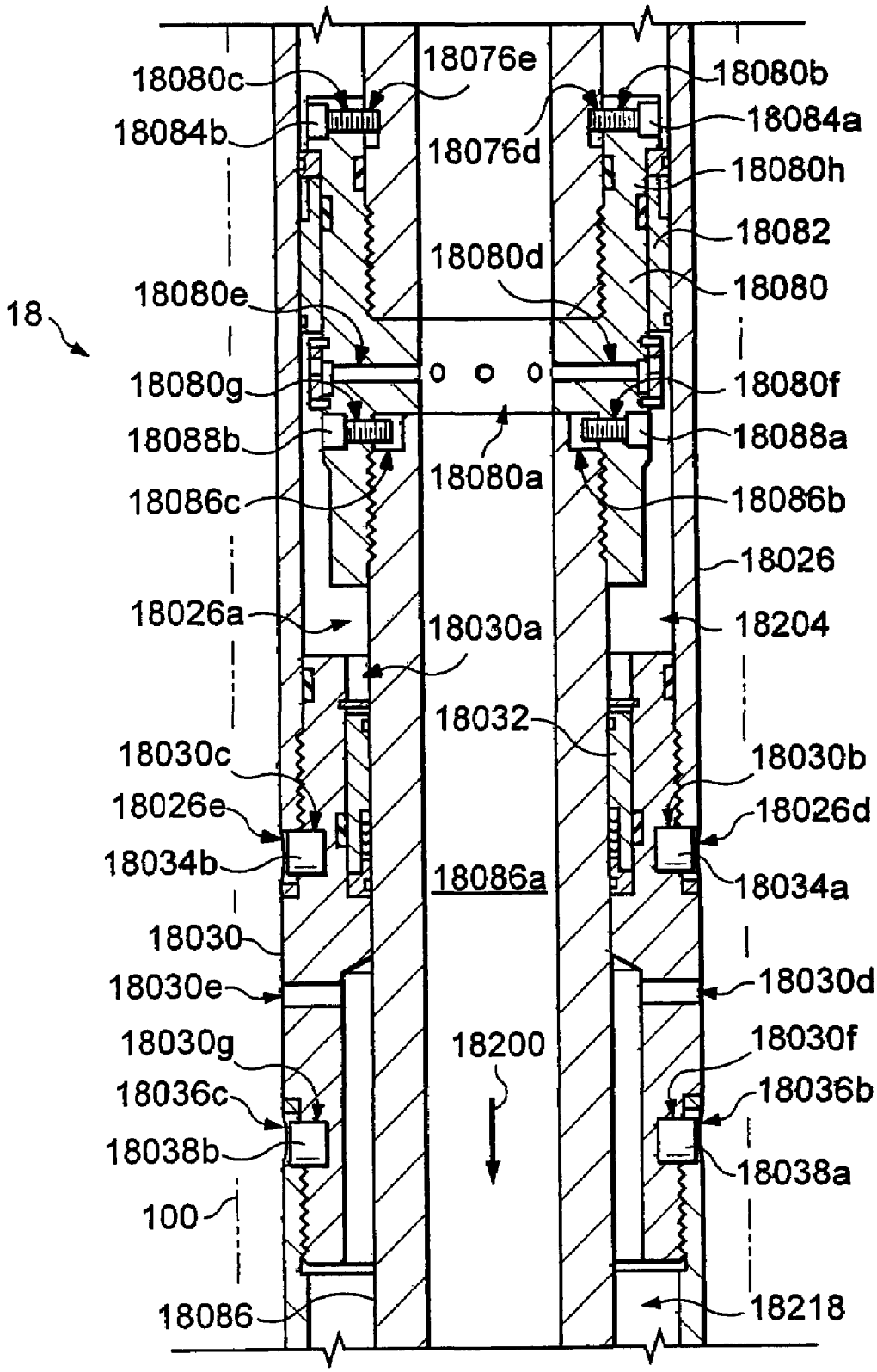
*Fig. 13A4*

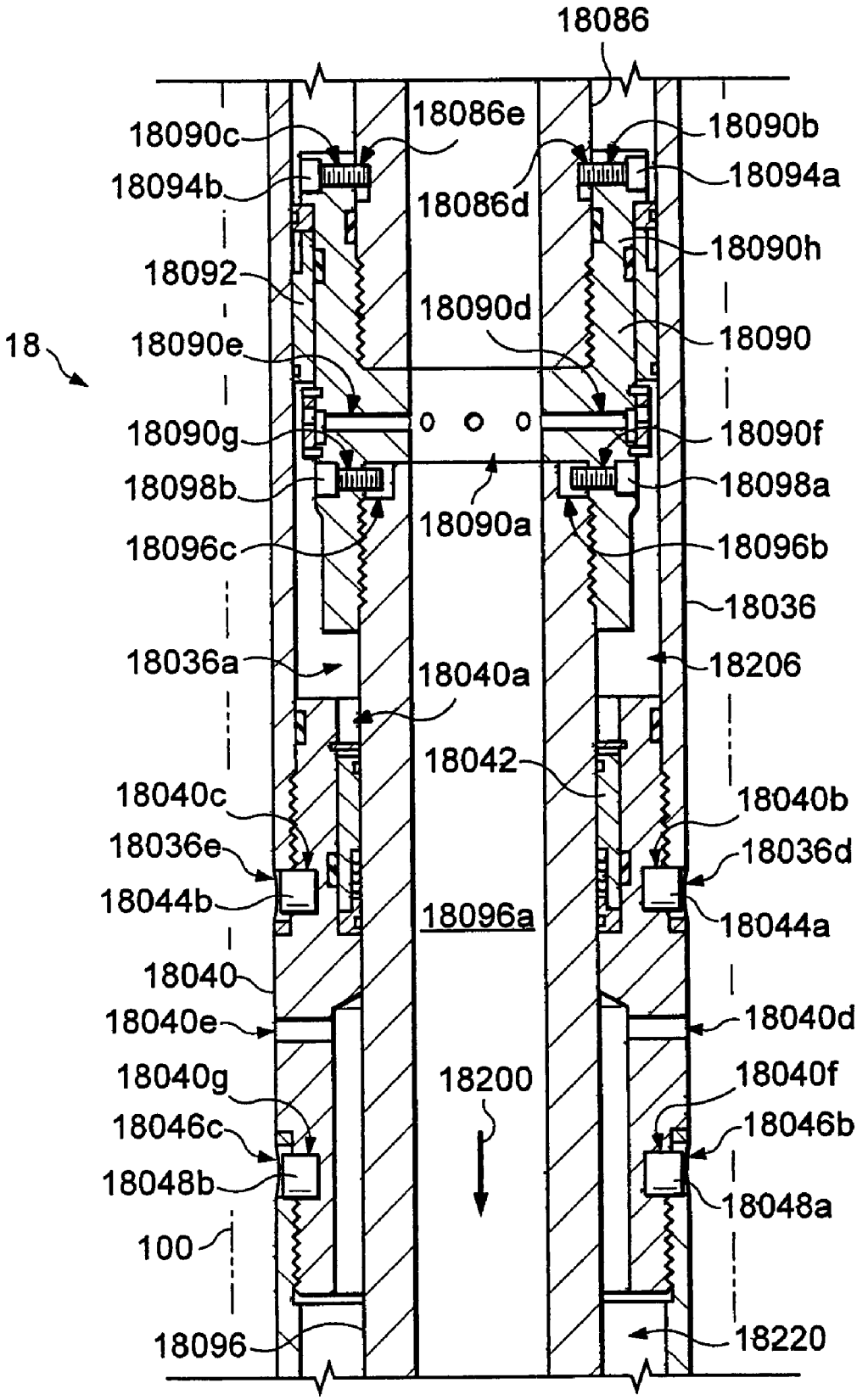
*Fig. 13A5*

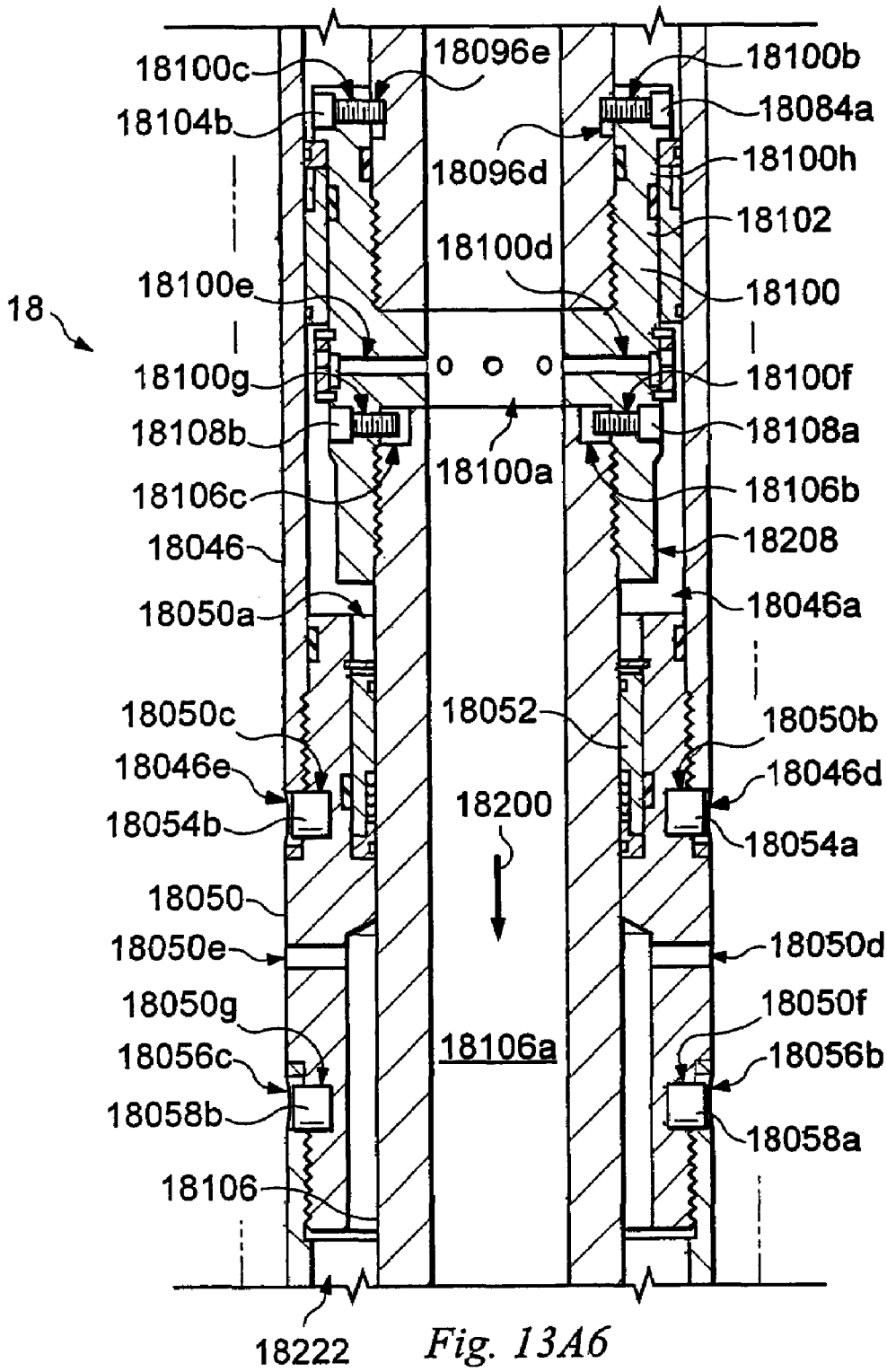
*Fig. 13A6*

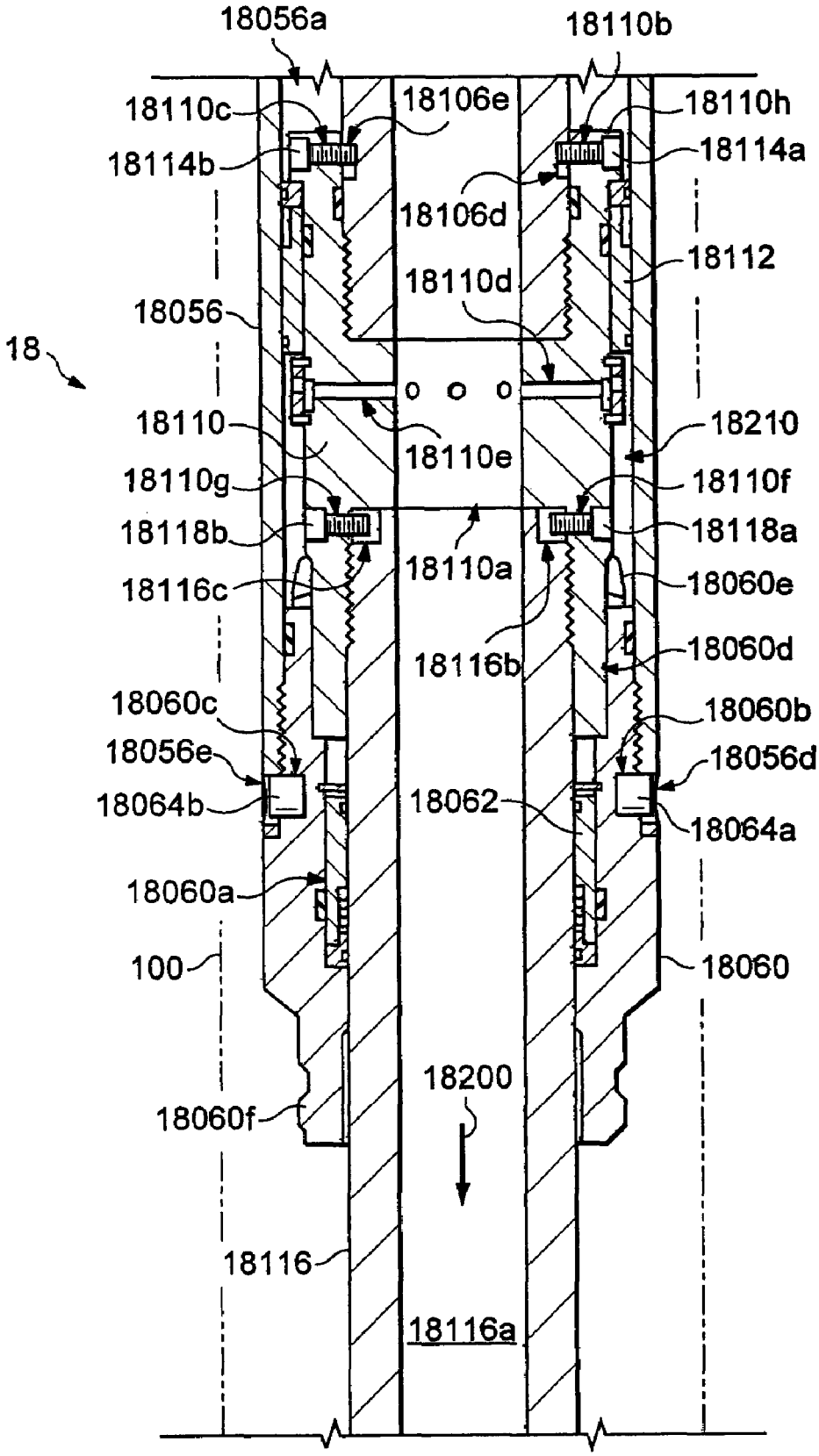
*Fig. 13A7*

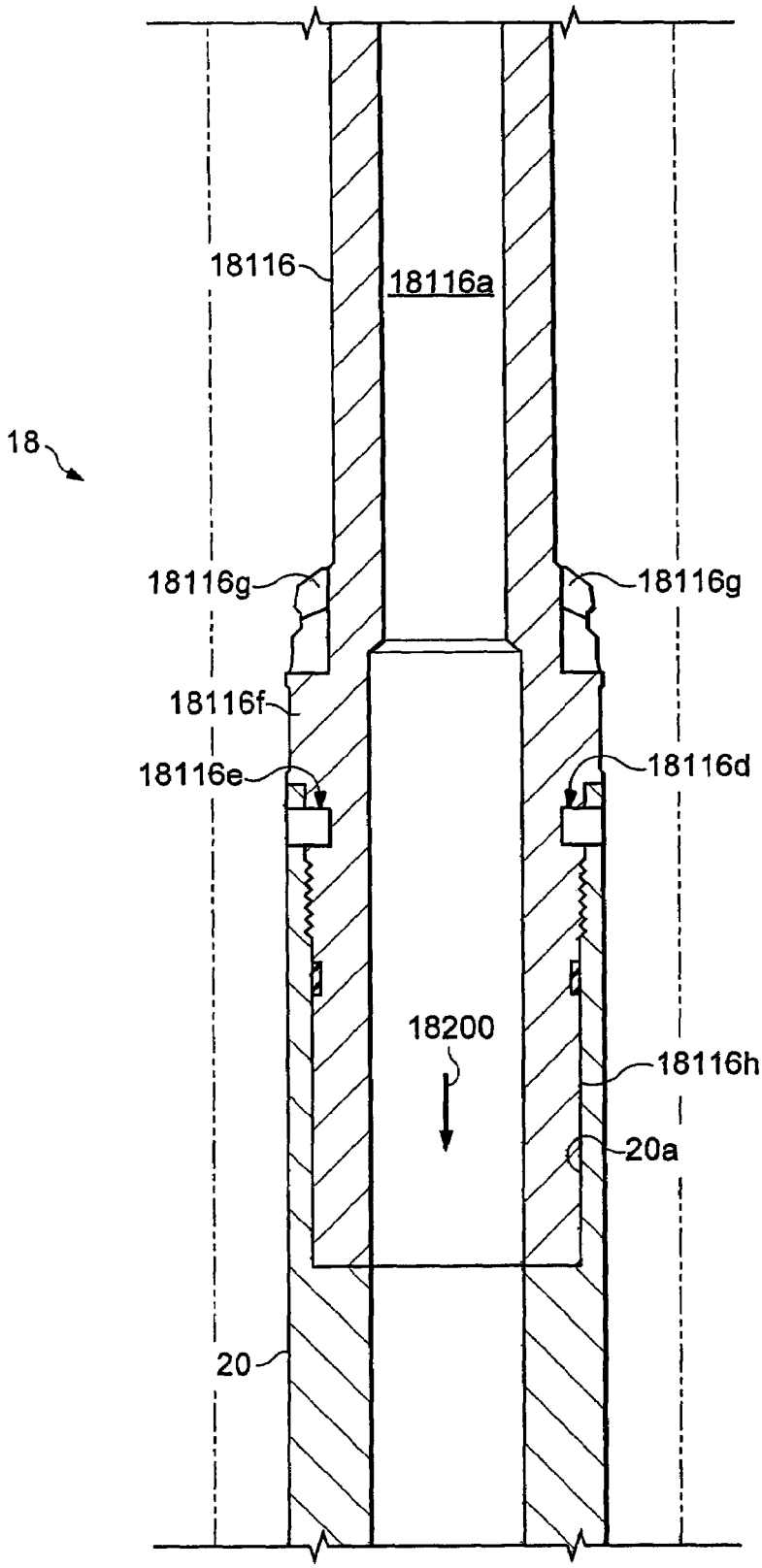
*Fig. 13A8*

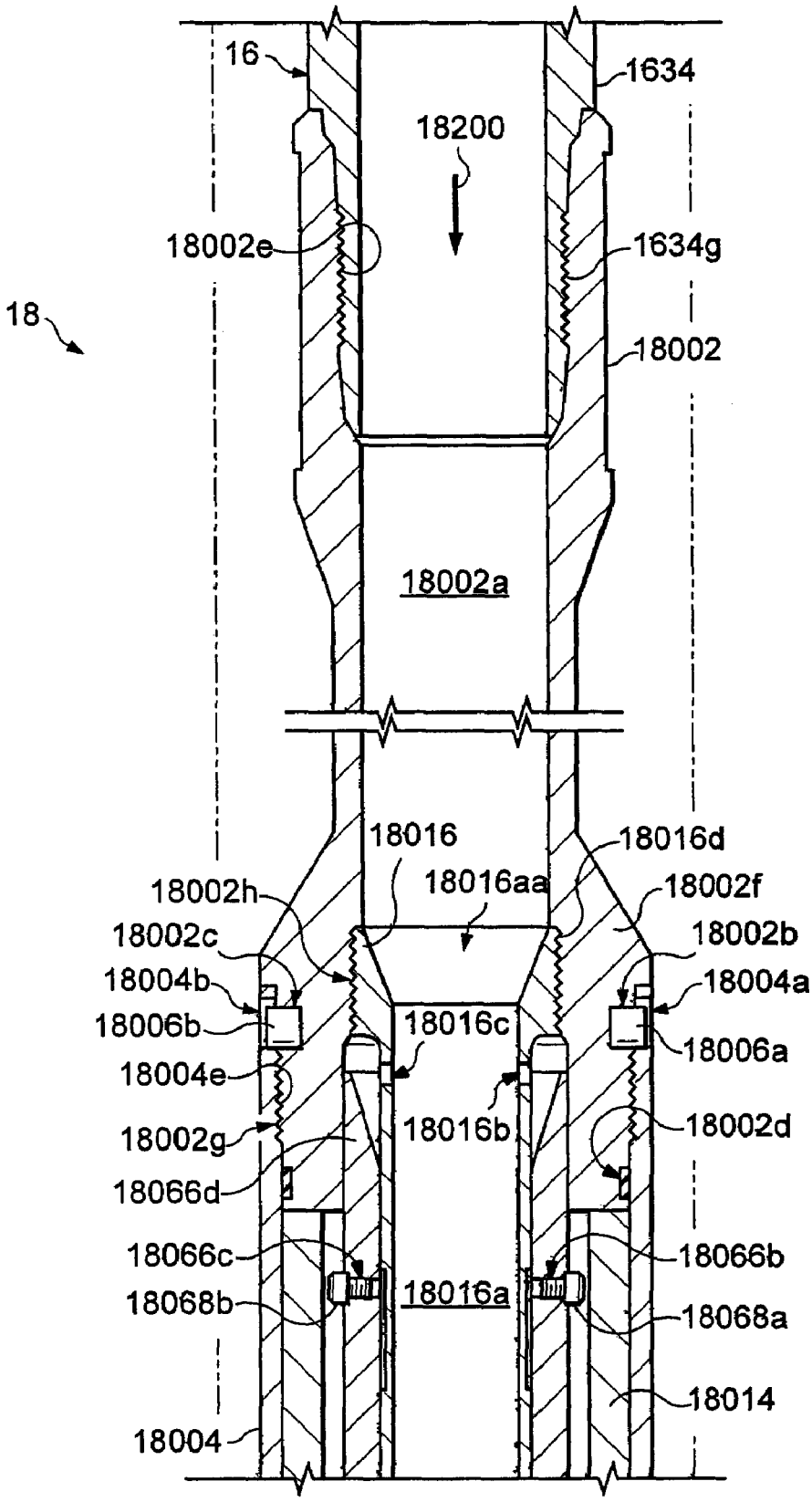
*Fig. 13B1*

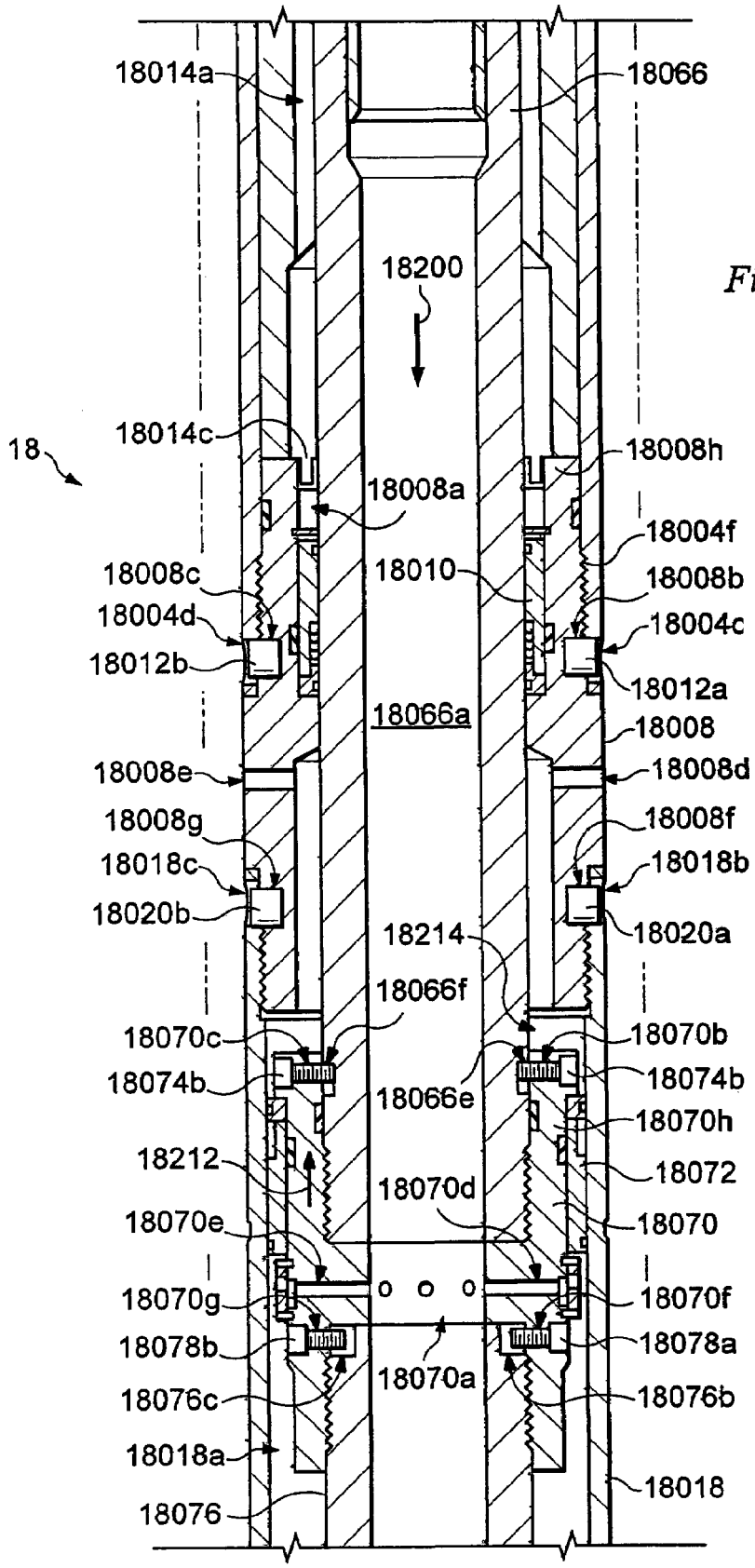
*Fig. 13B2*

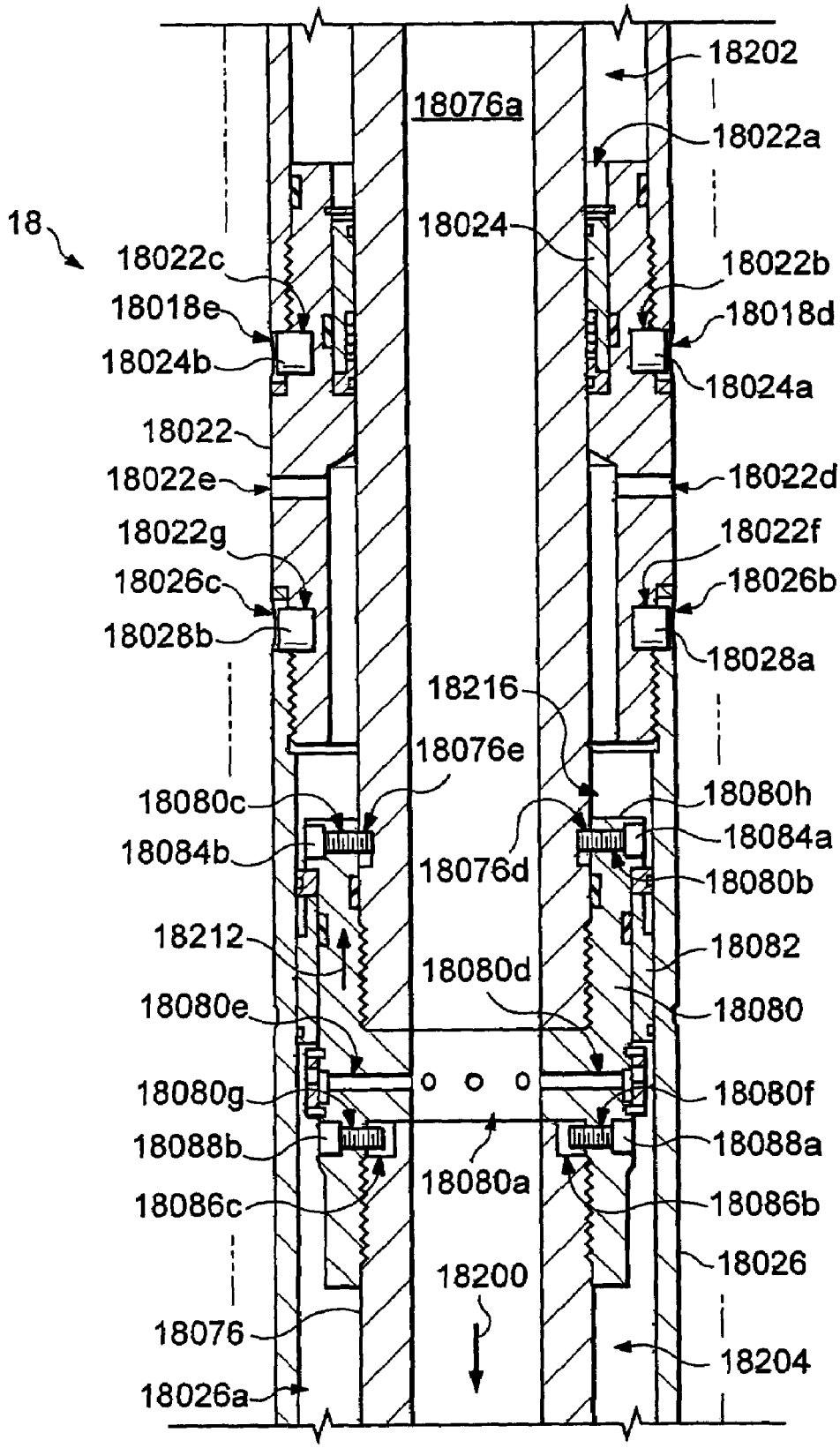
*Fig. 13B3*

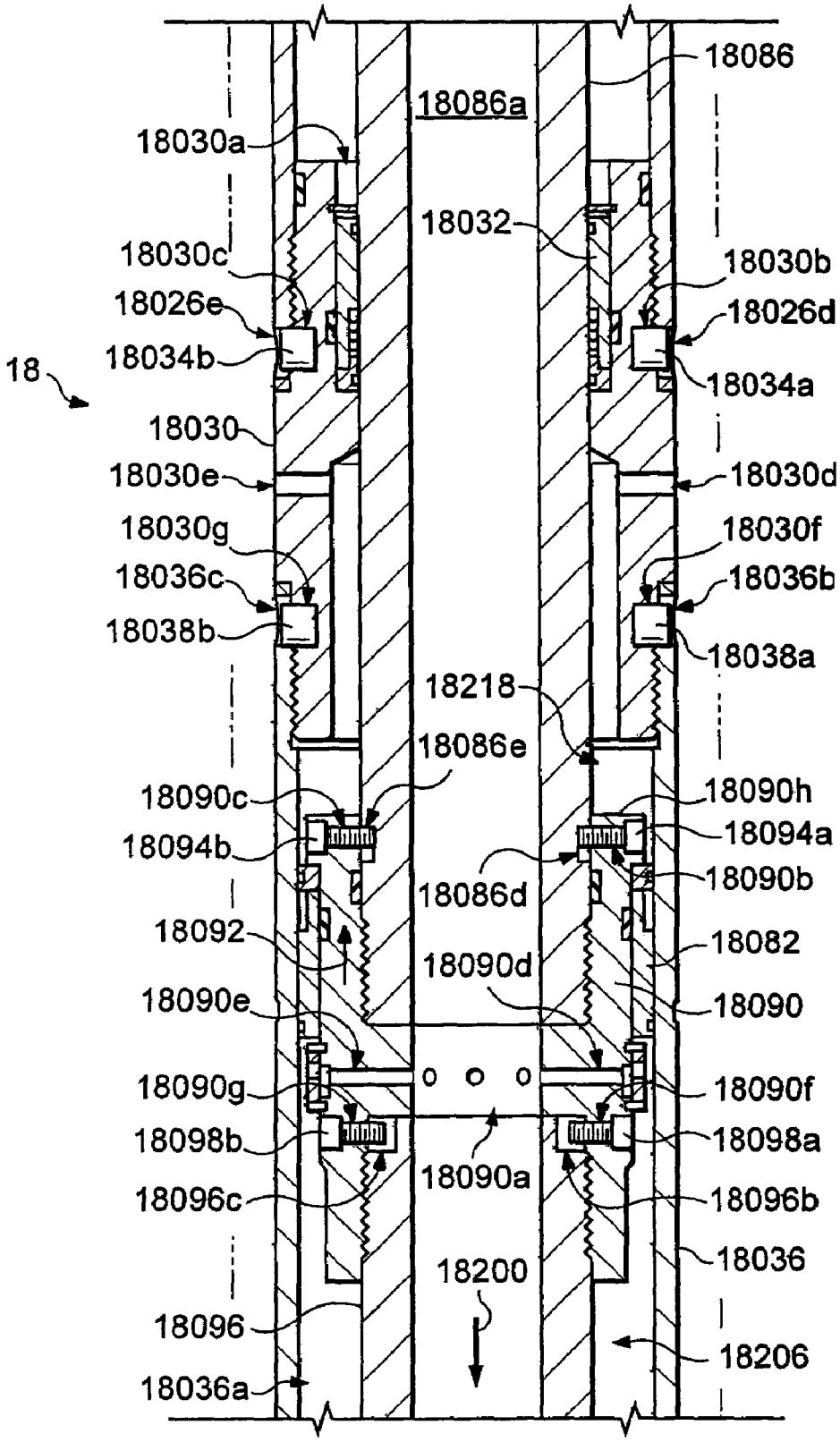
*Fig. 13B4*

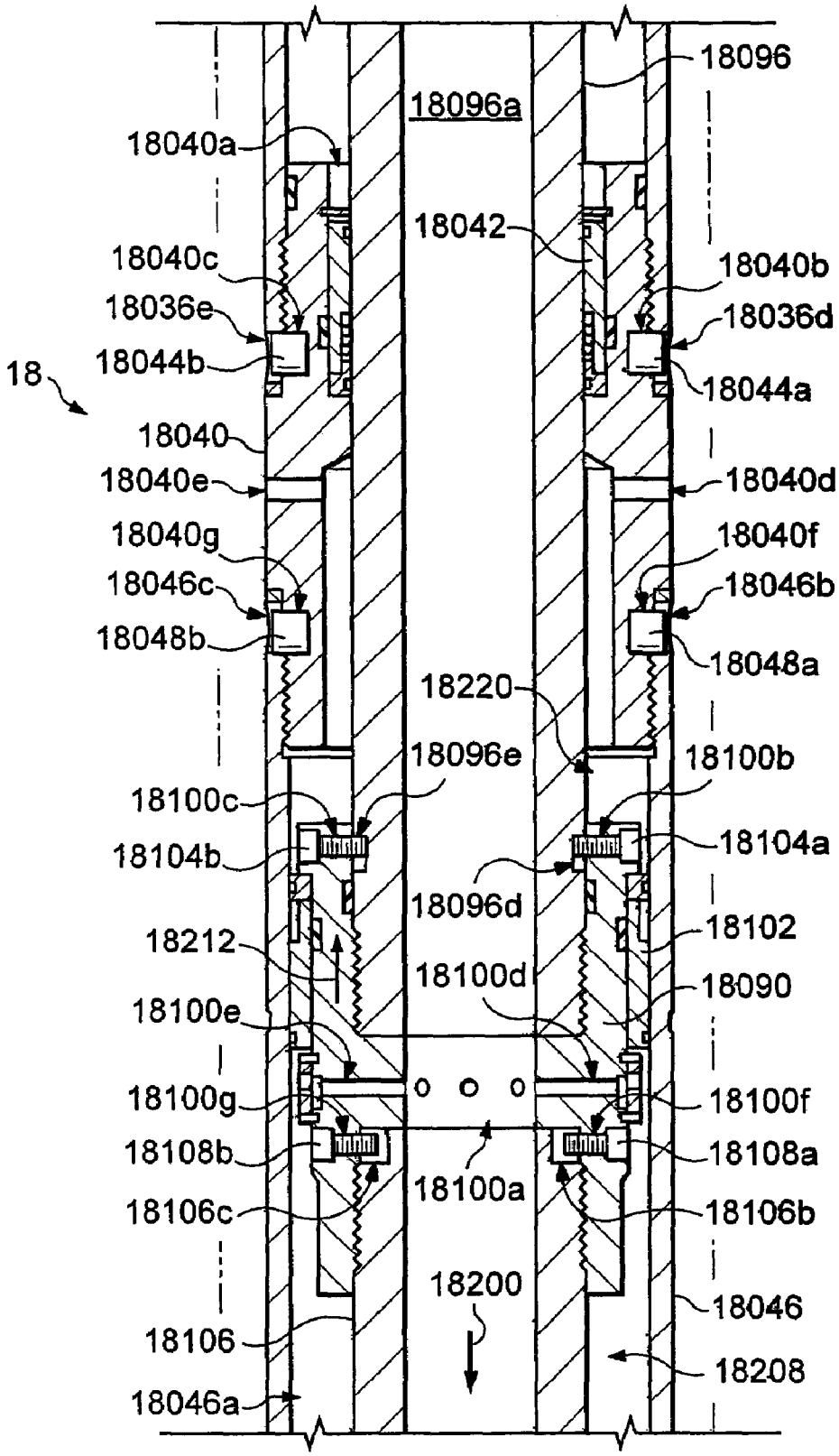
*Fig. 13B5*

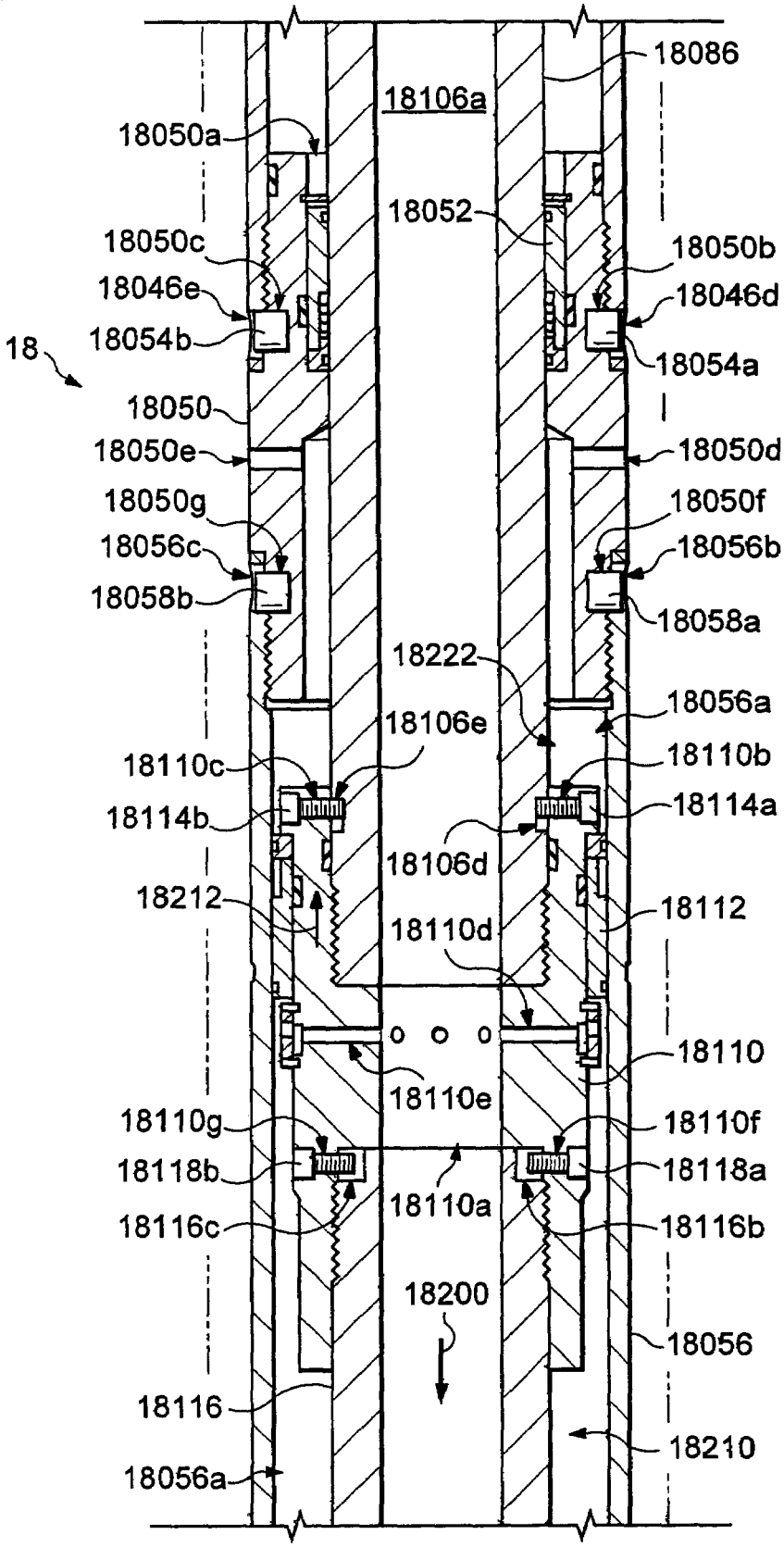
*Fig. 13B6*

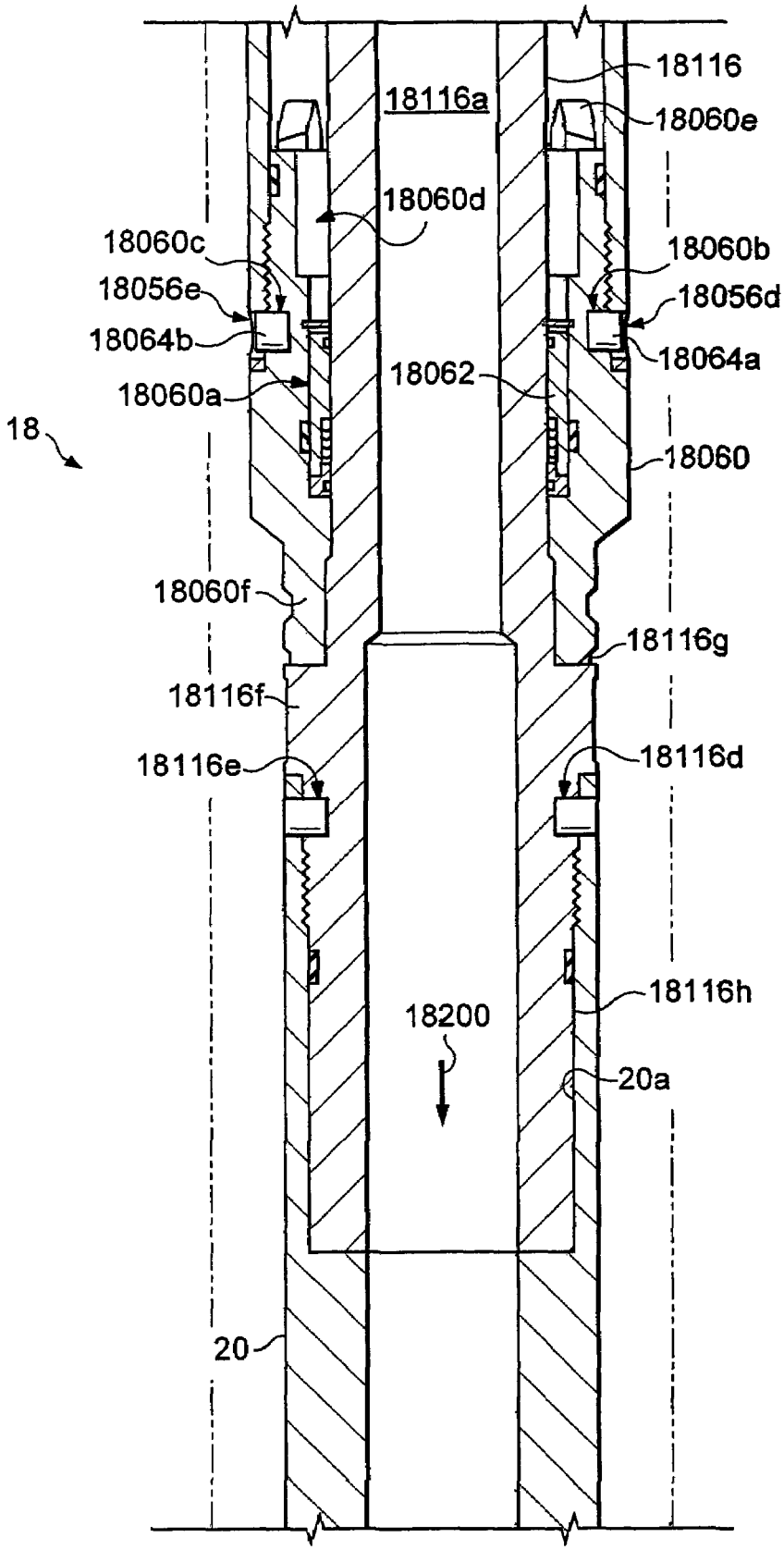
*Fig. 13B7*

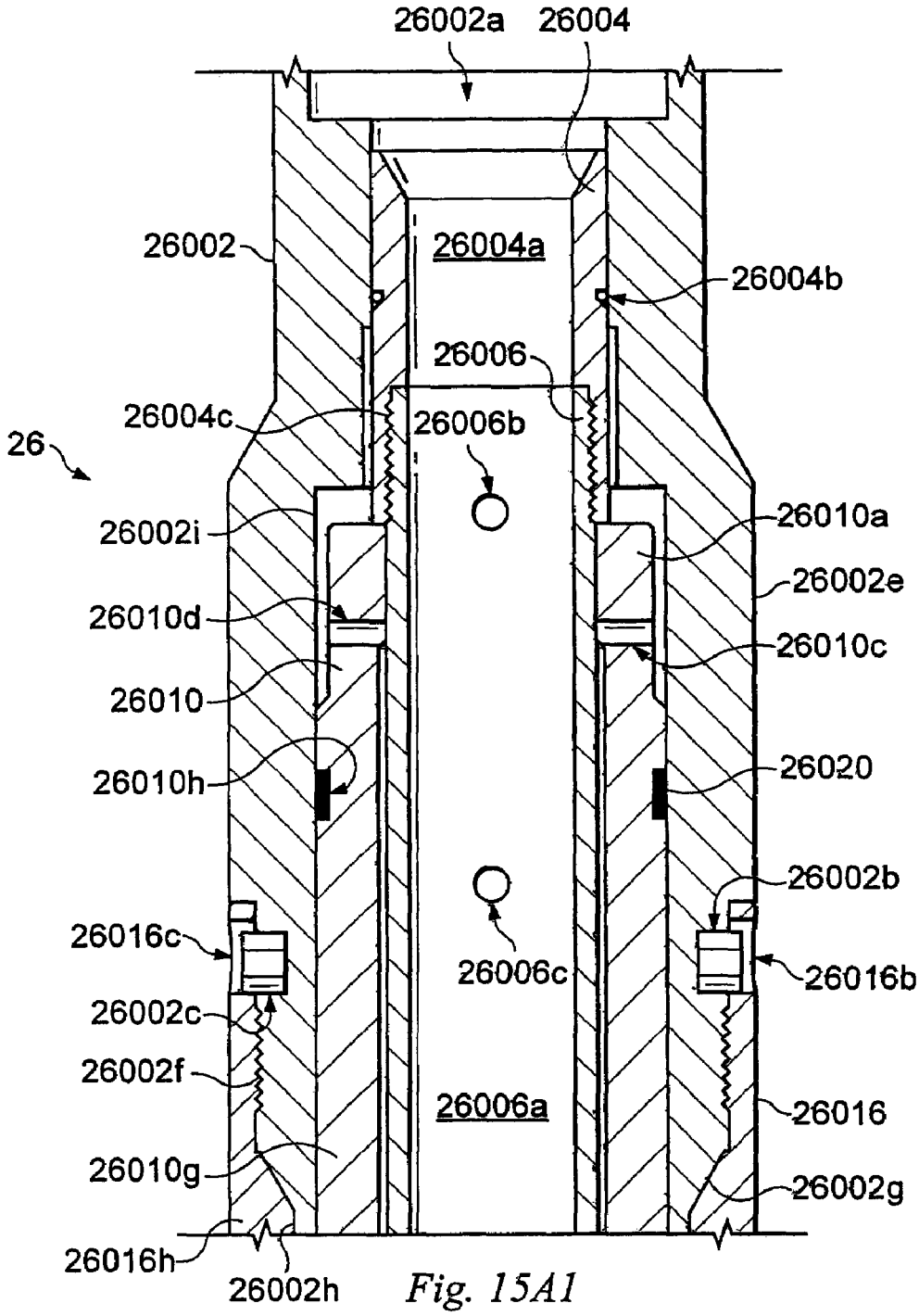
*Fig. 15A1*

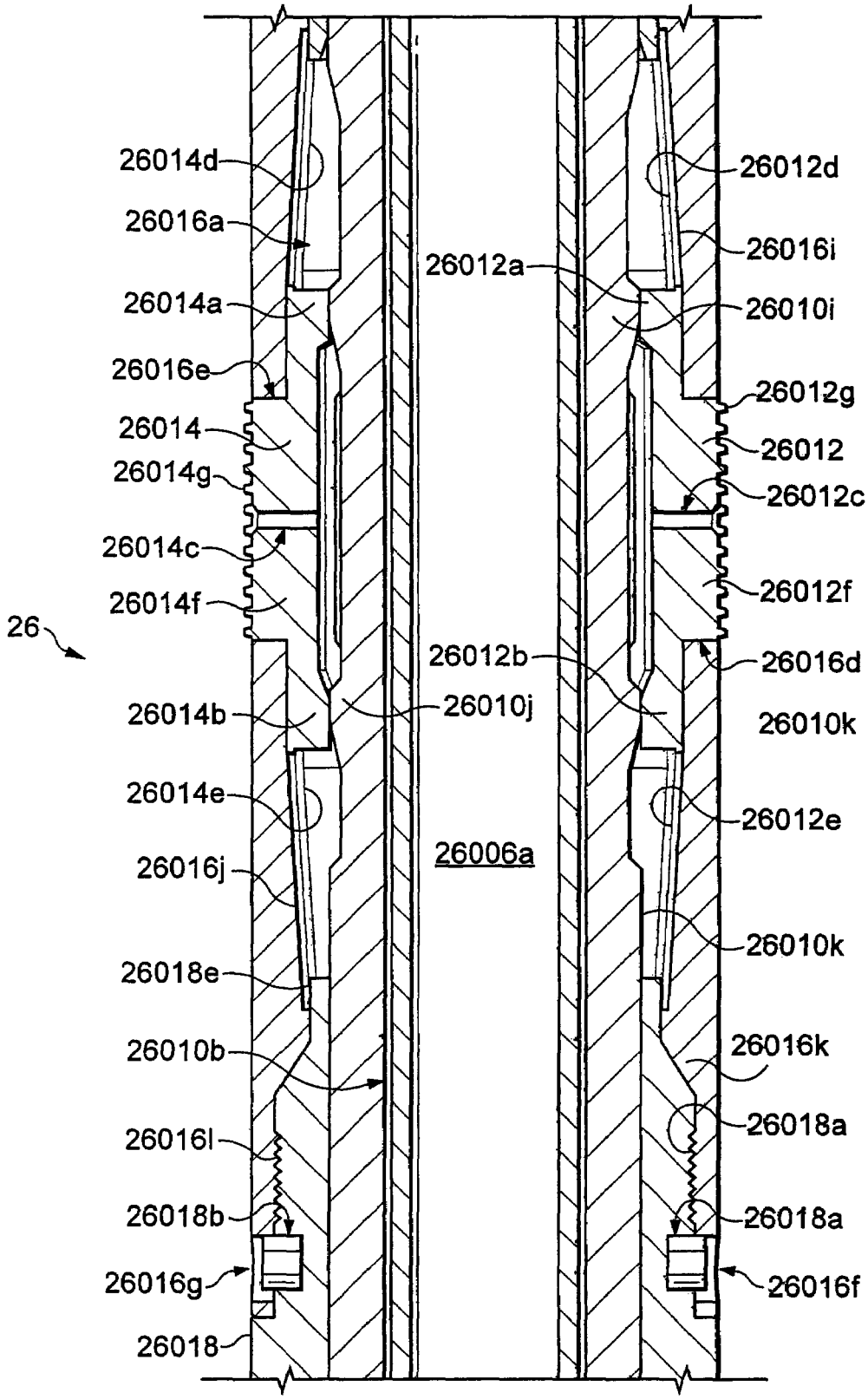
*Fig. 15A2*

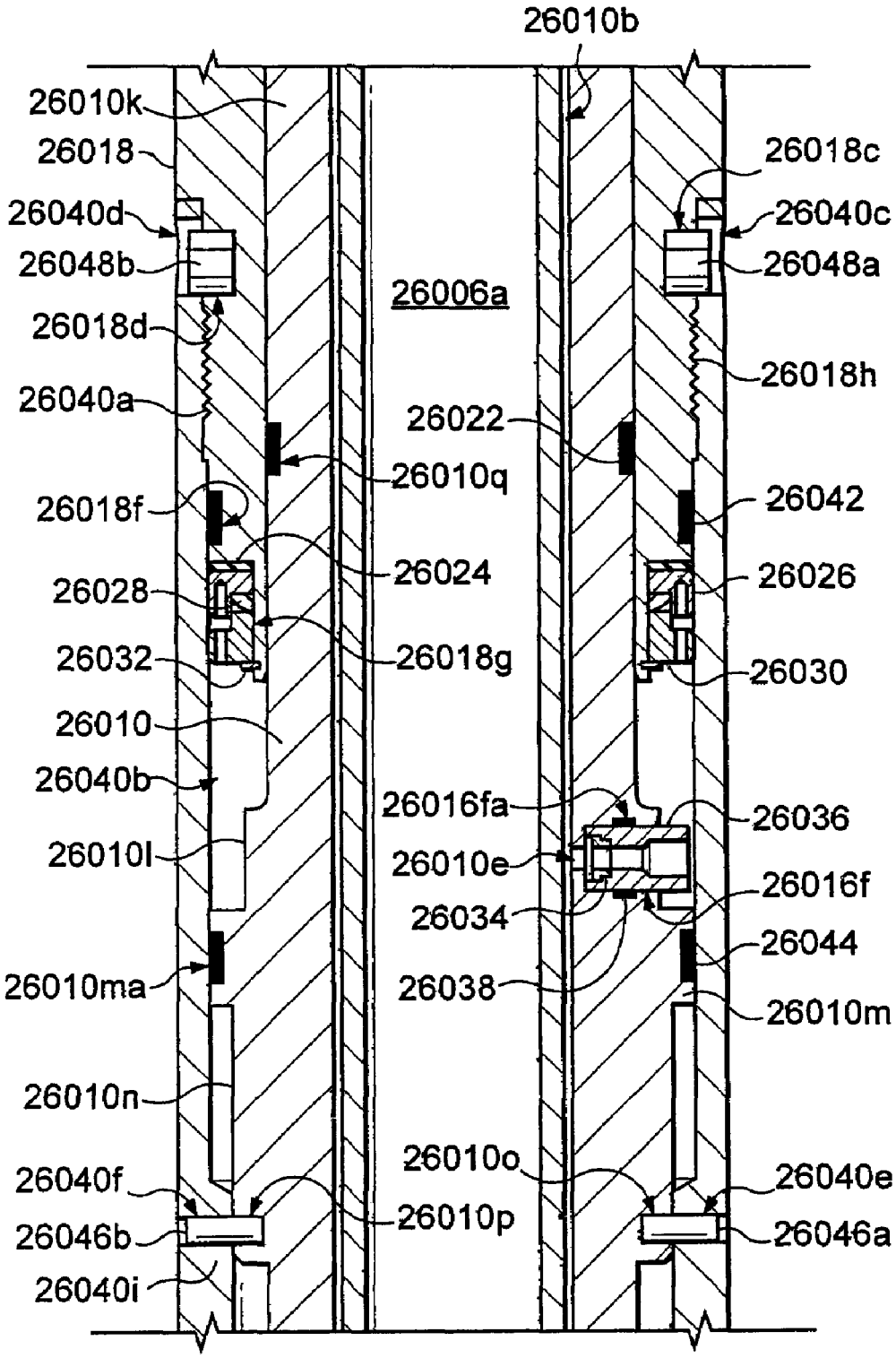
*Fig. 15B1*

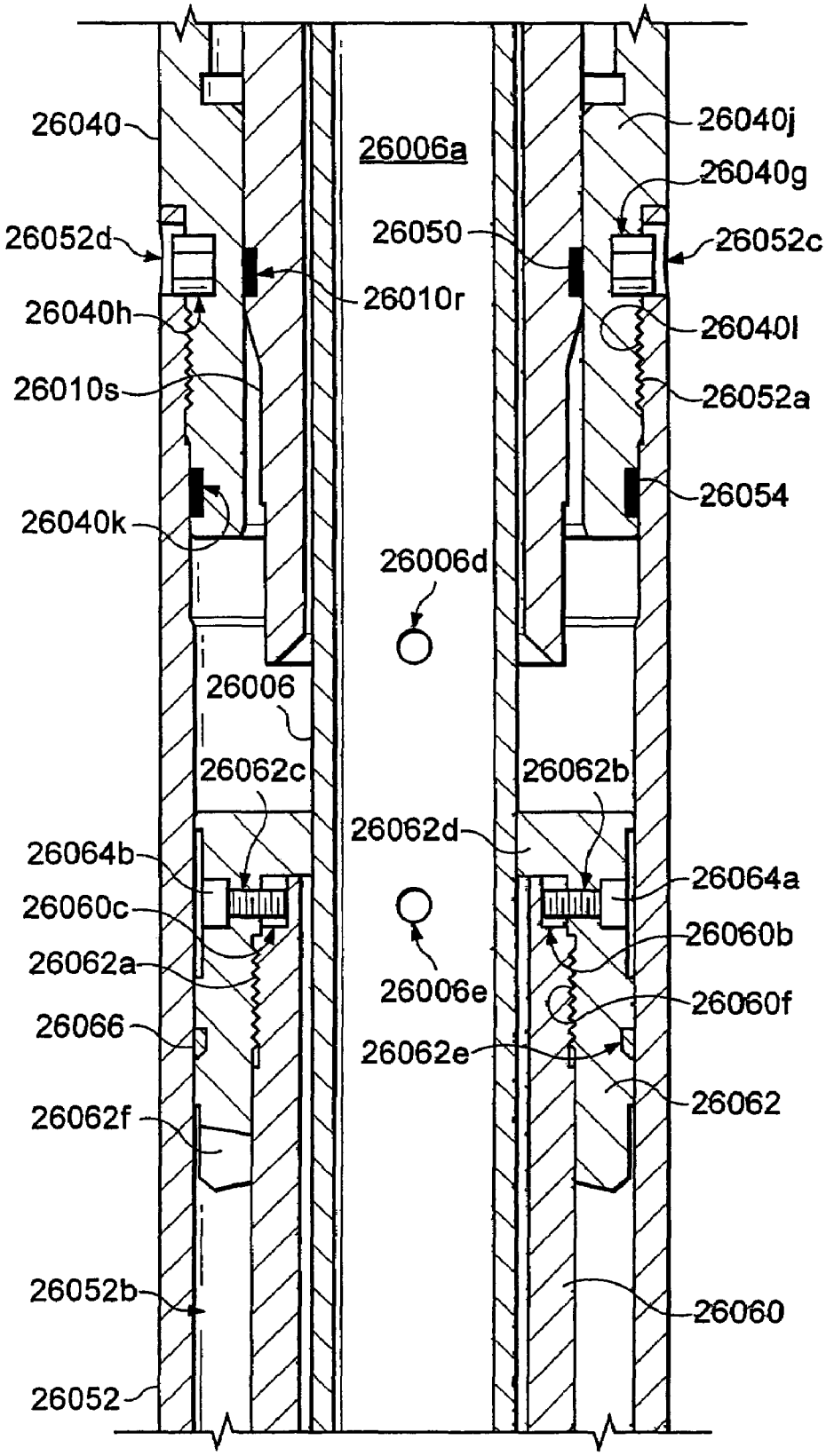
*Fig. 15B2*

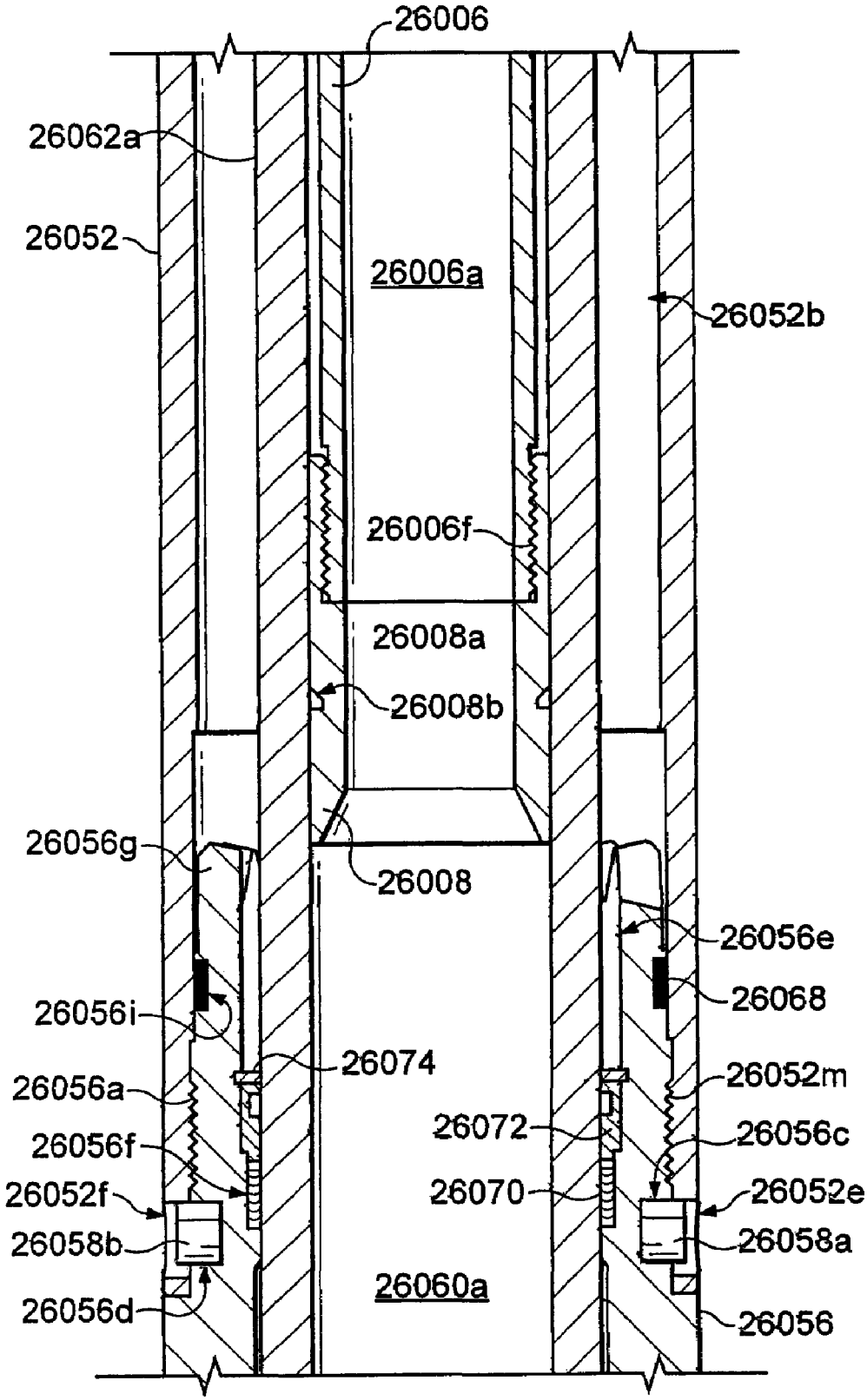
*Fig. 15C1*

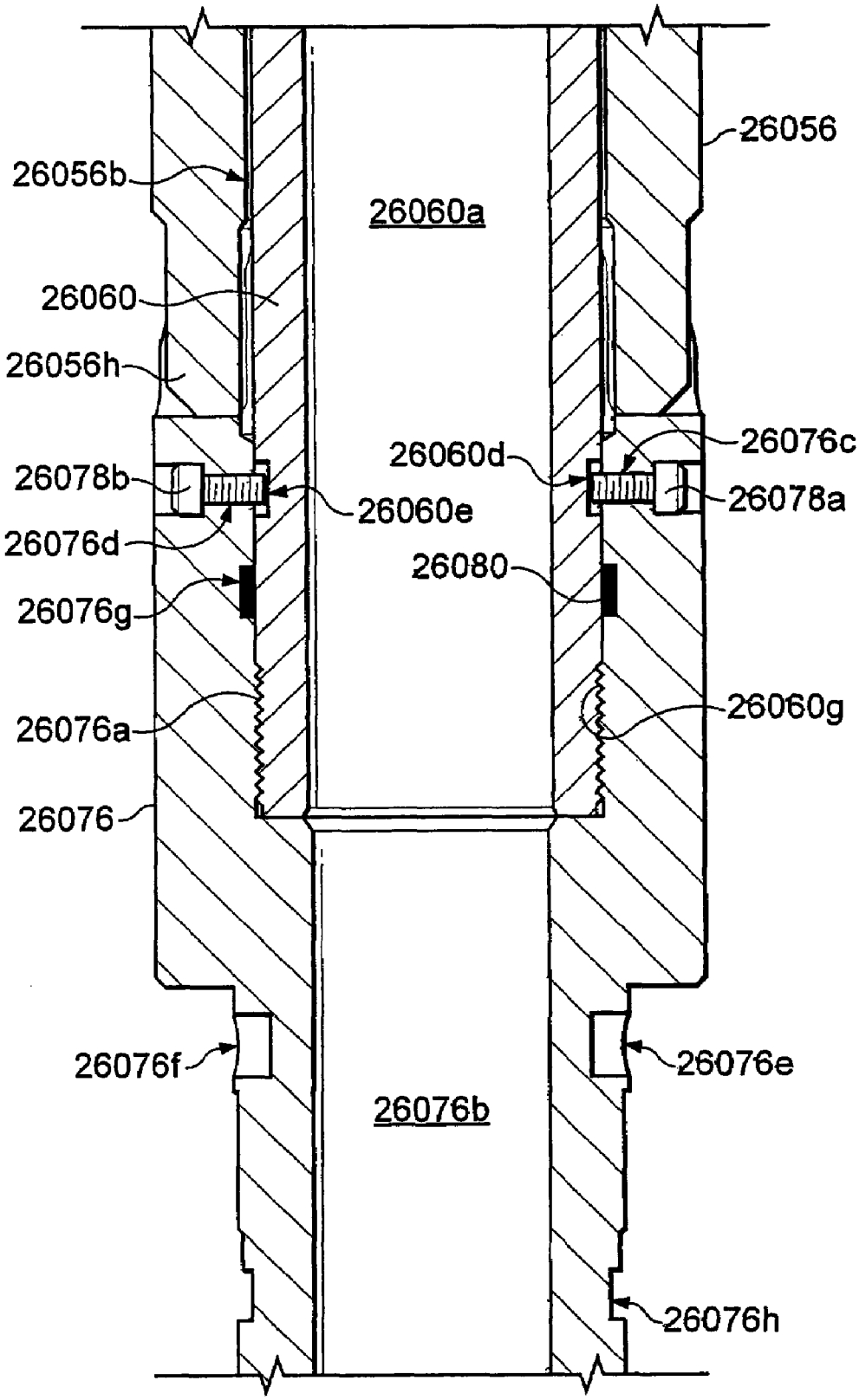
*Fig. 15C2*

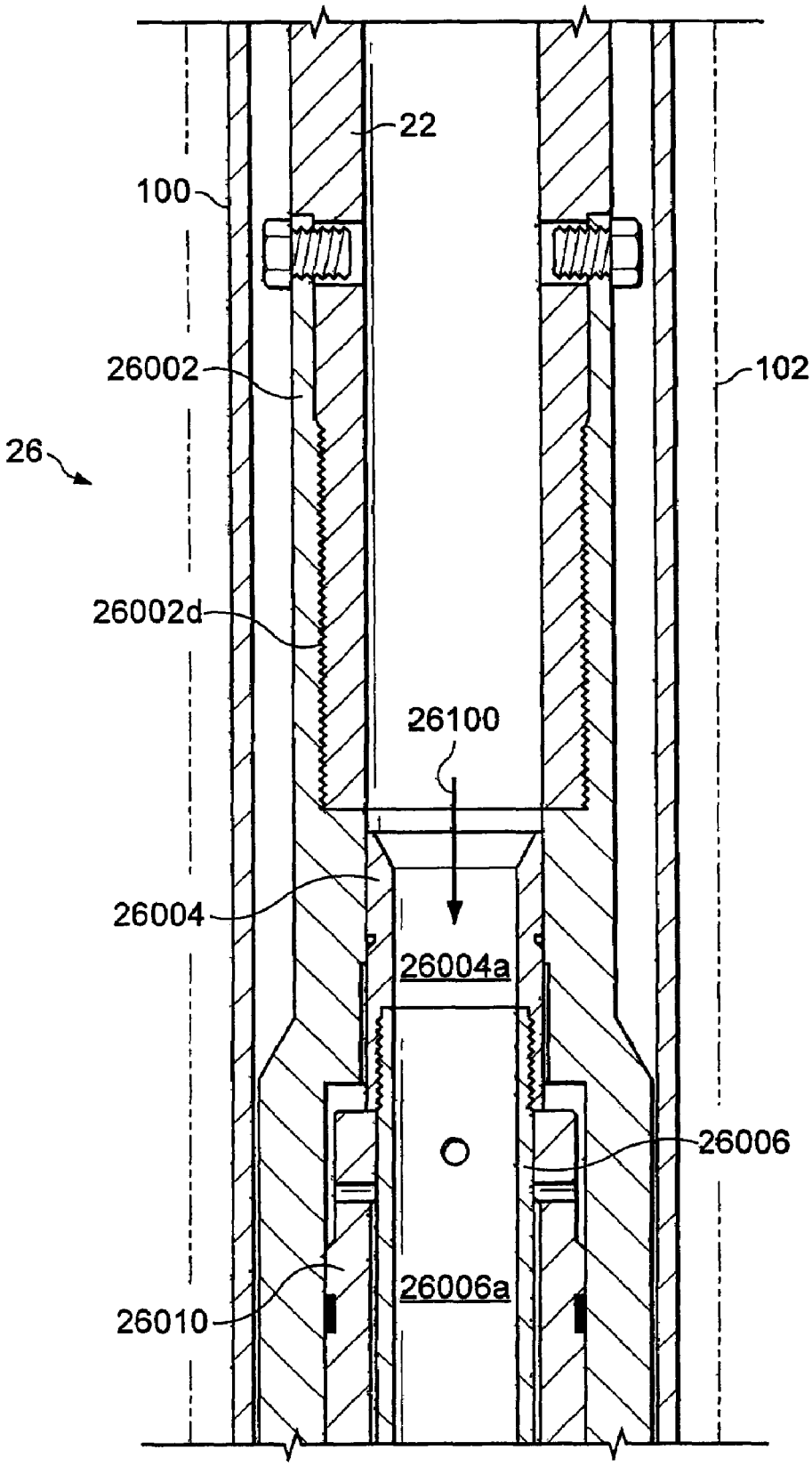
*Fig. 15E1*

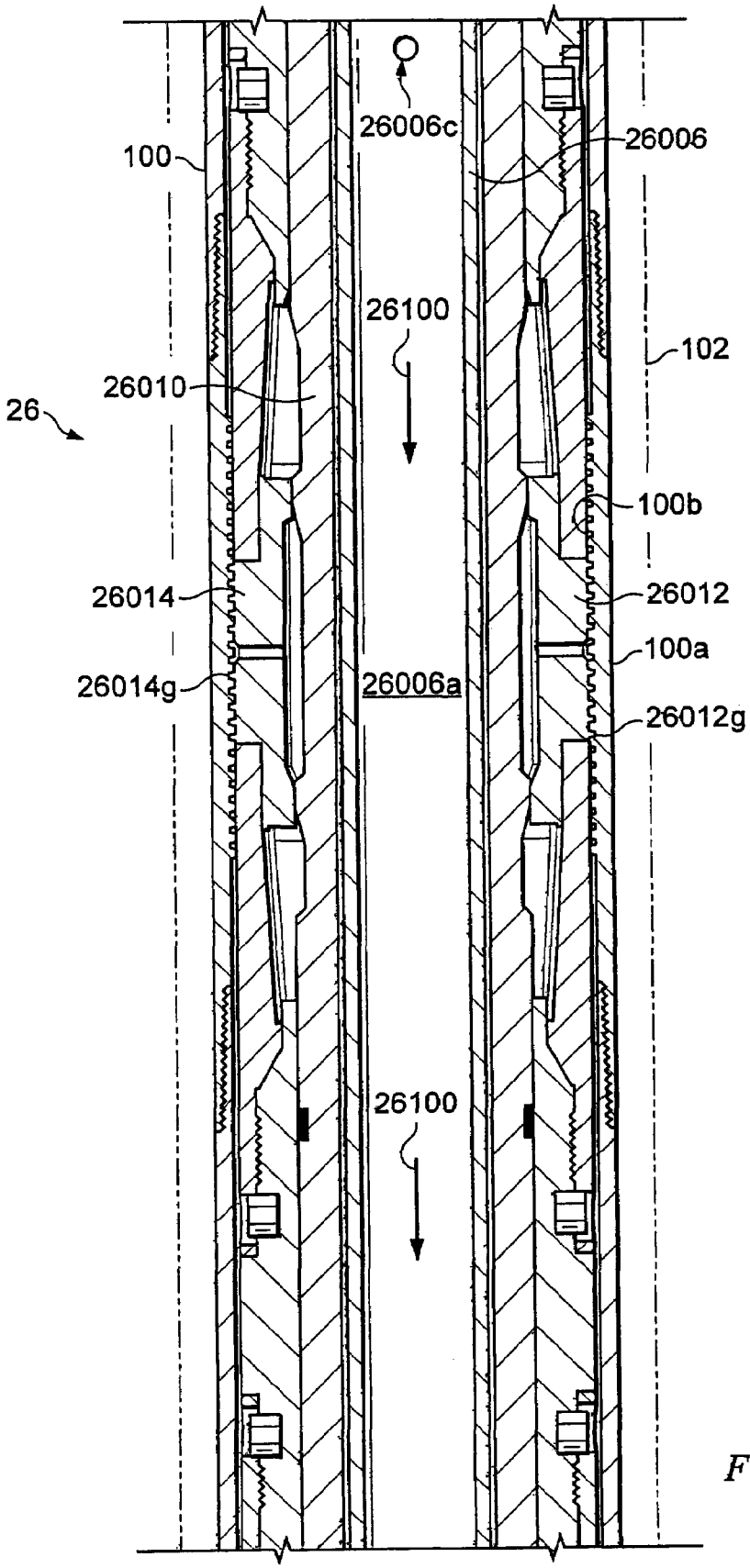
*Fig. 15E2*

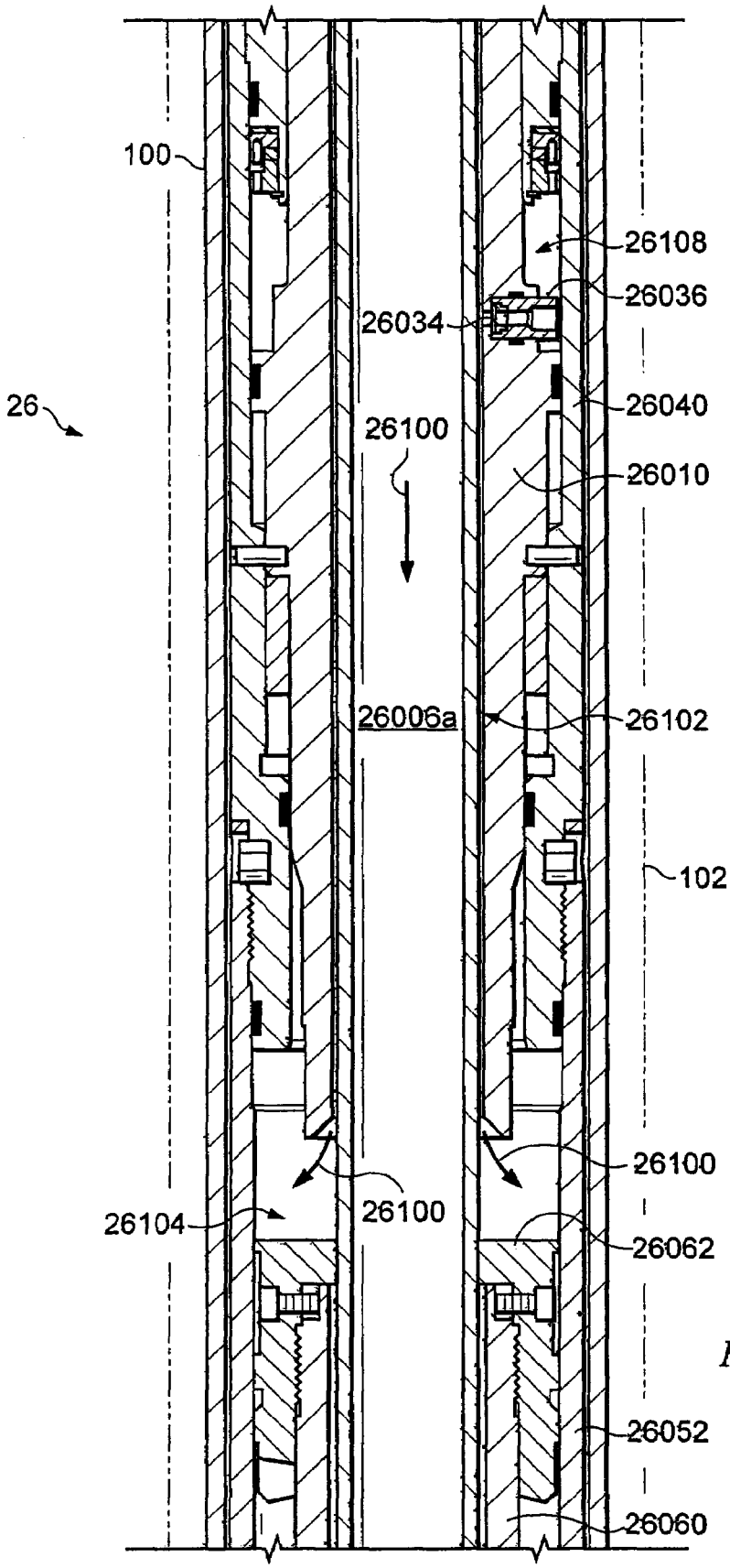
*Fig. 15E3*

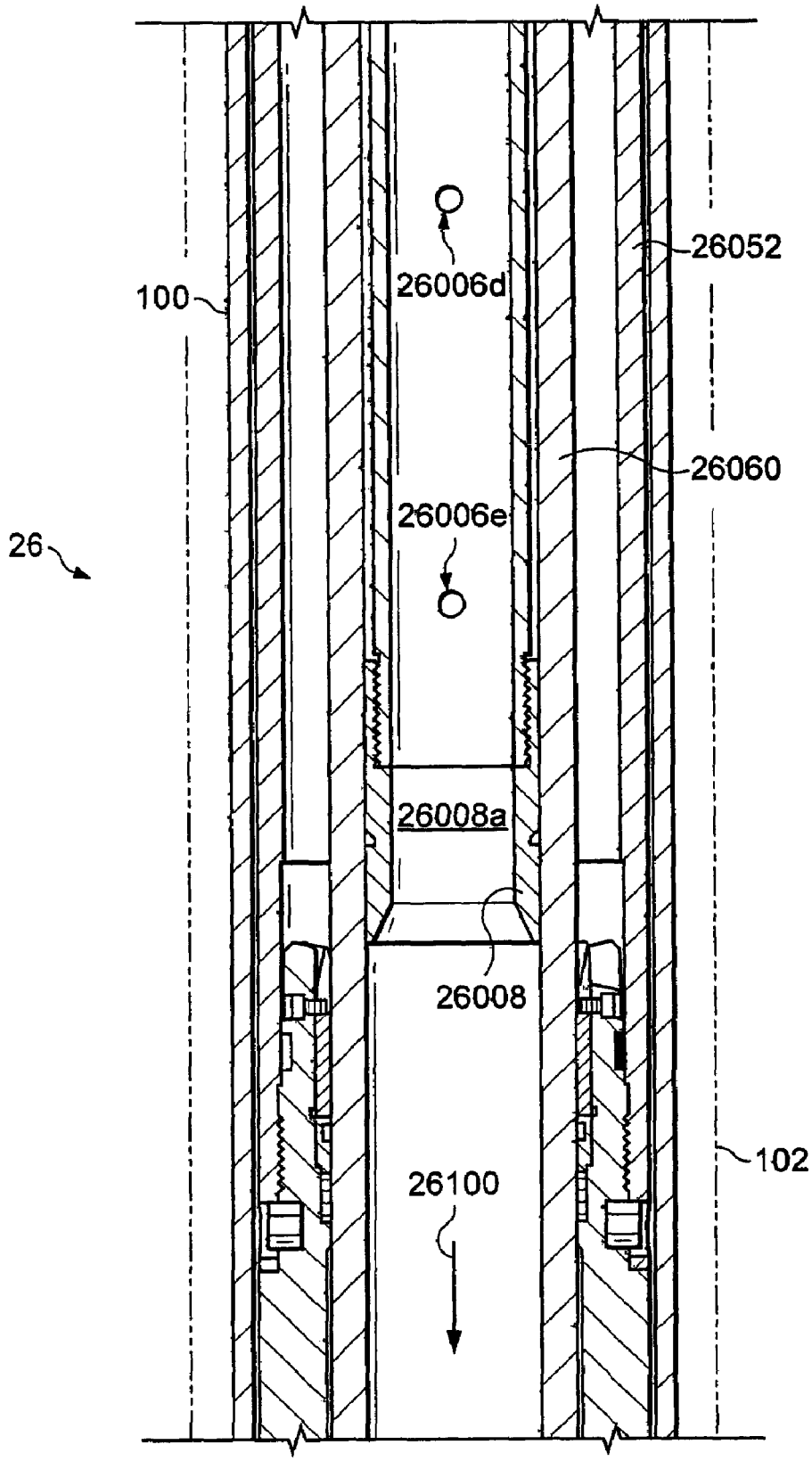
*Fig. 15E4*

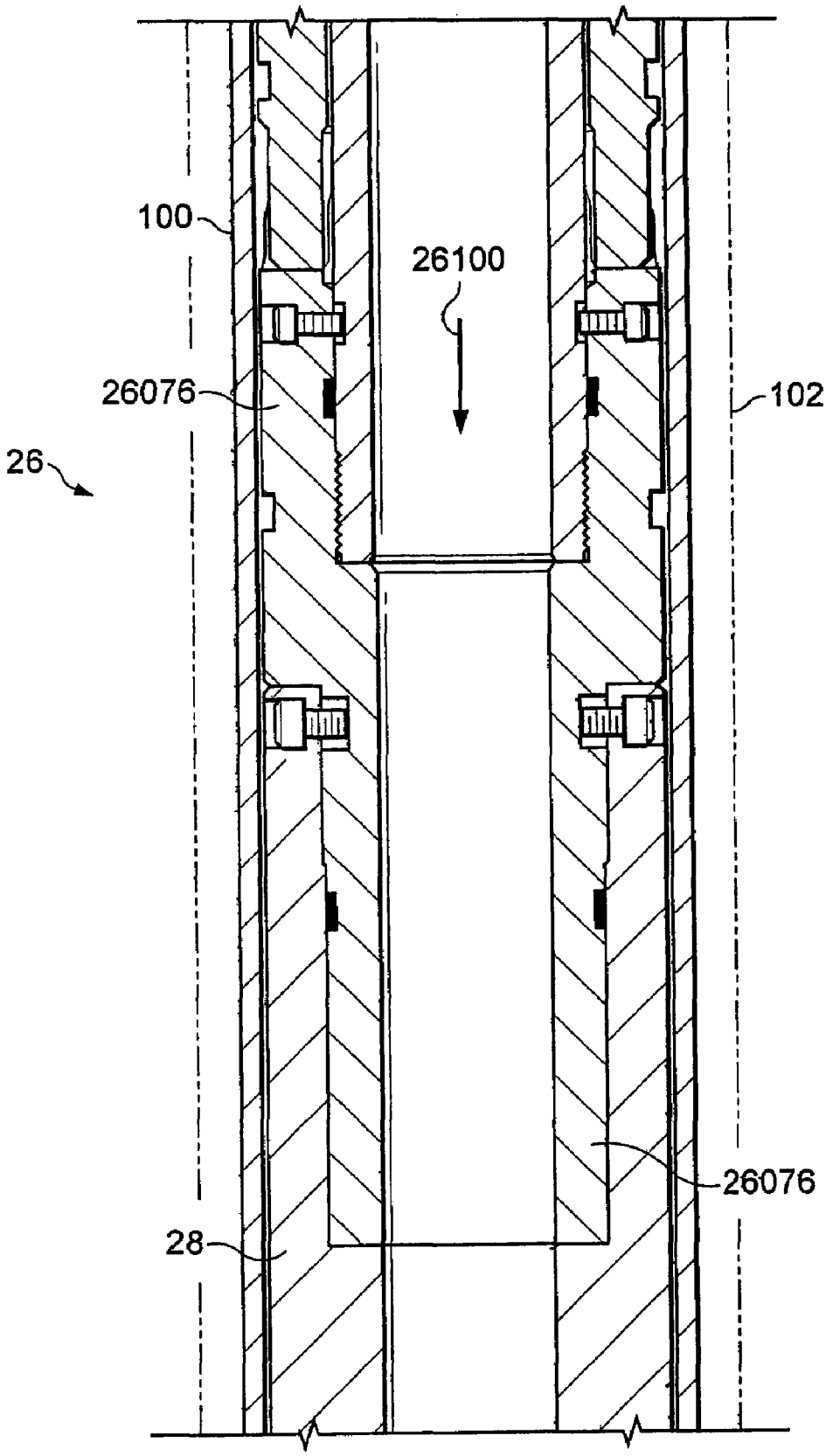
*Fig. 15E5*

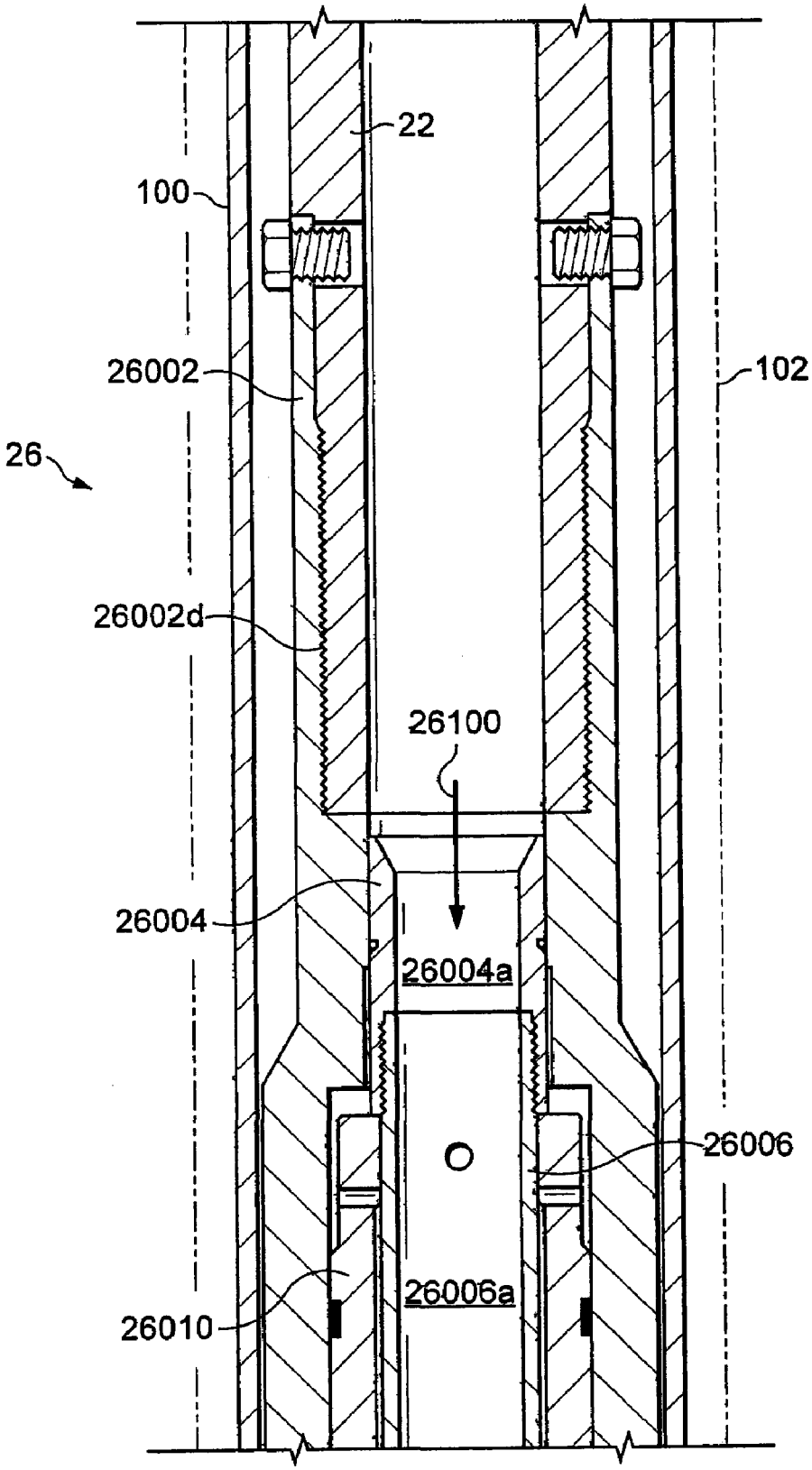
*Fig. 15F1*

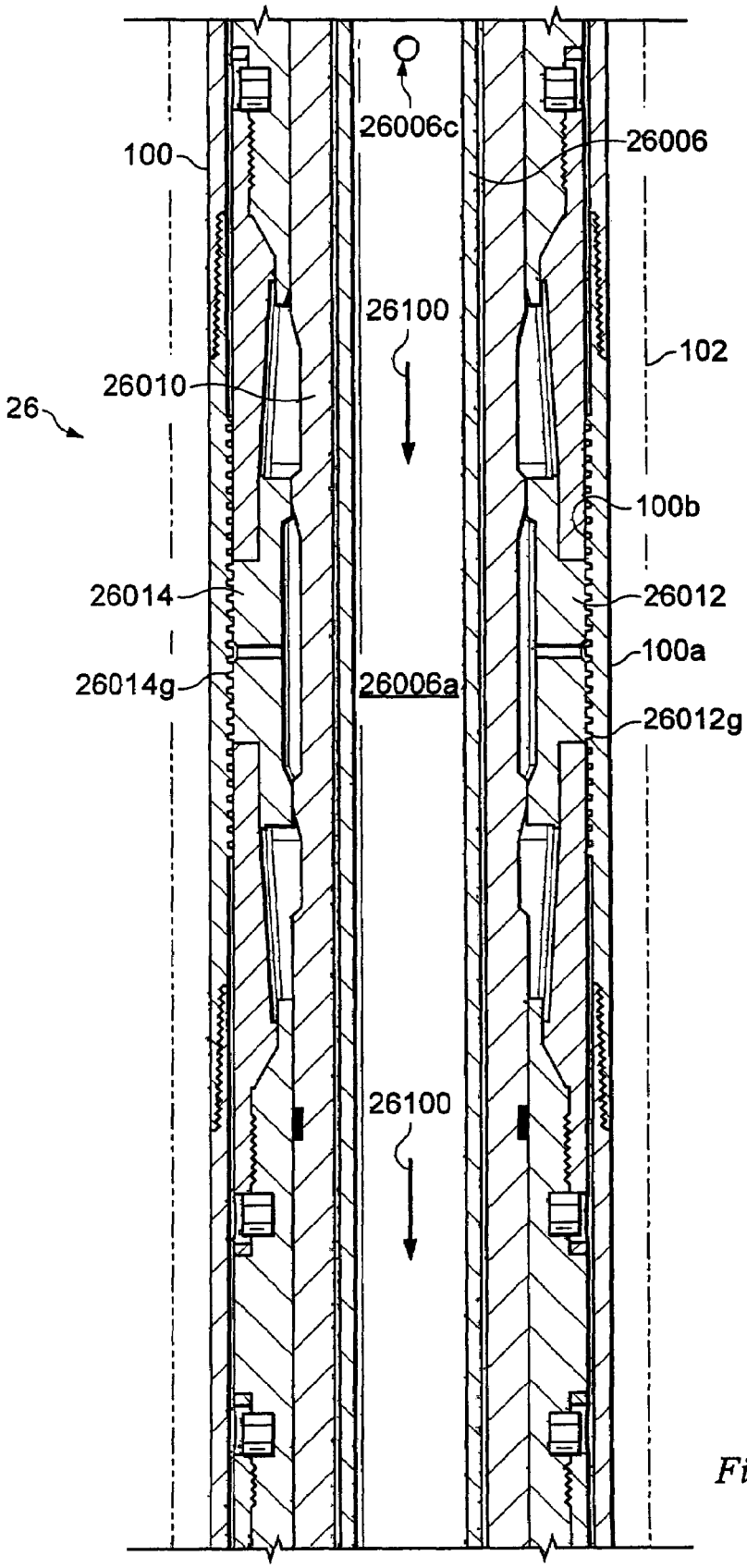
*Fig. 15F2*

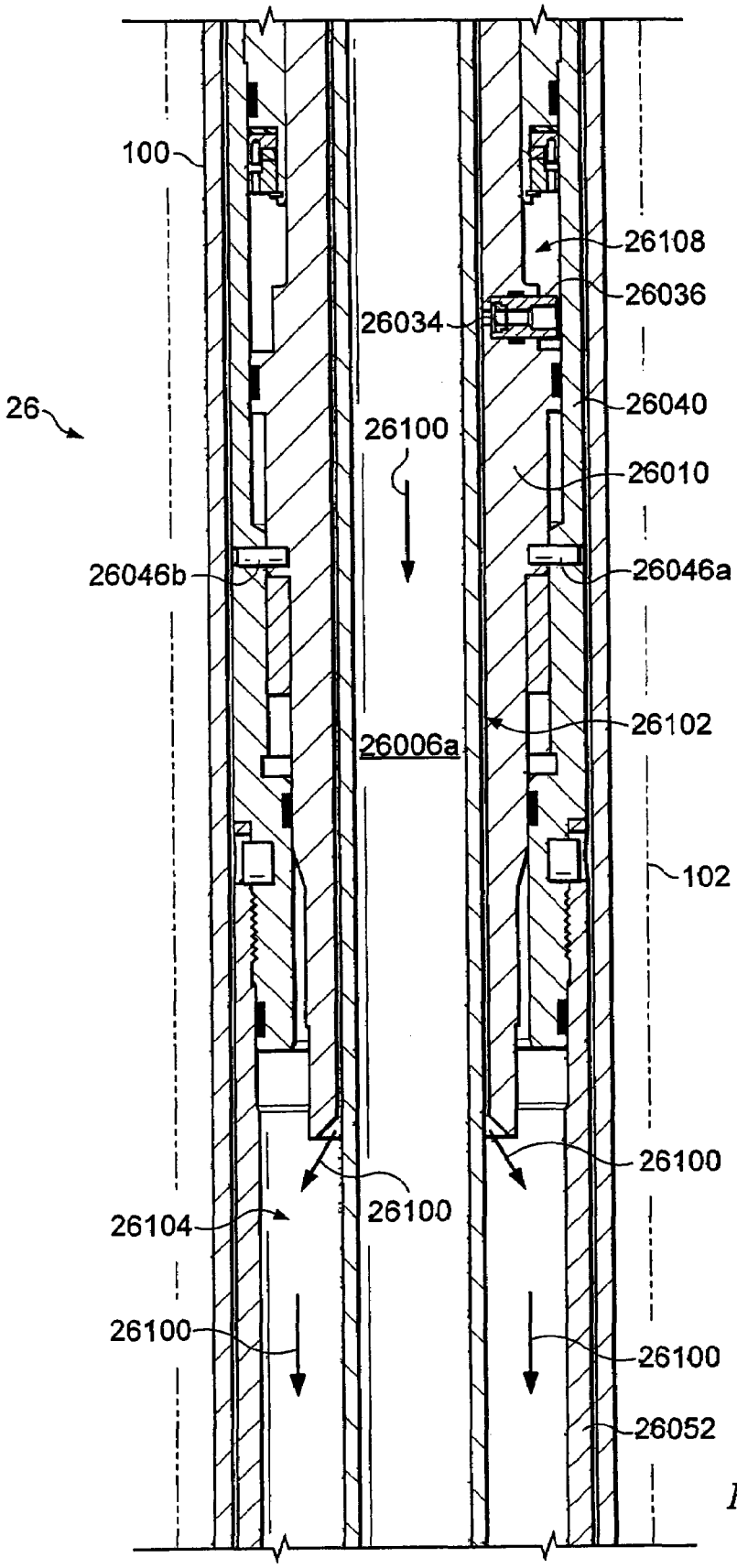
*Fig. 15F3*

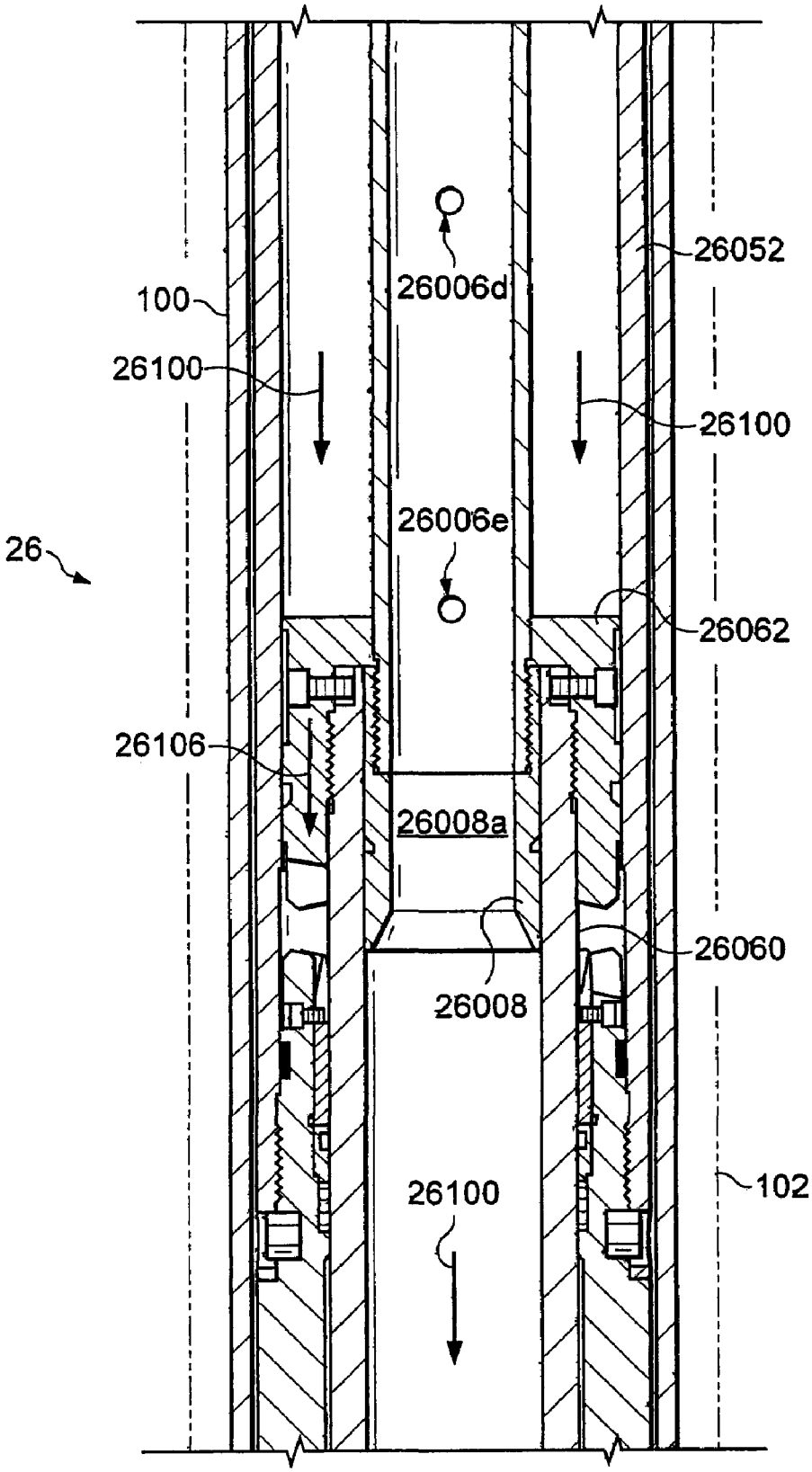
*Fig. 15F4*

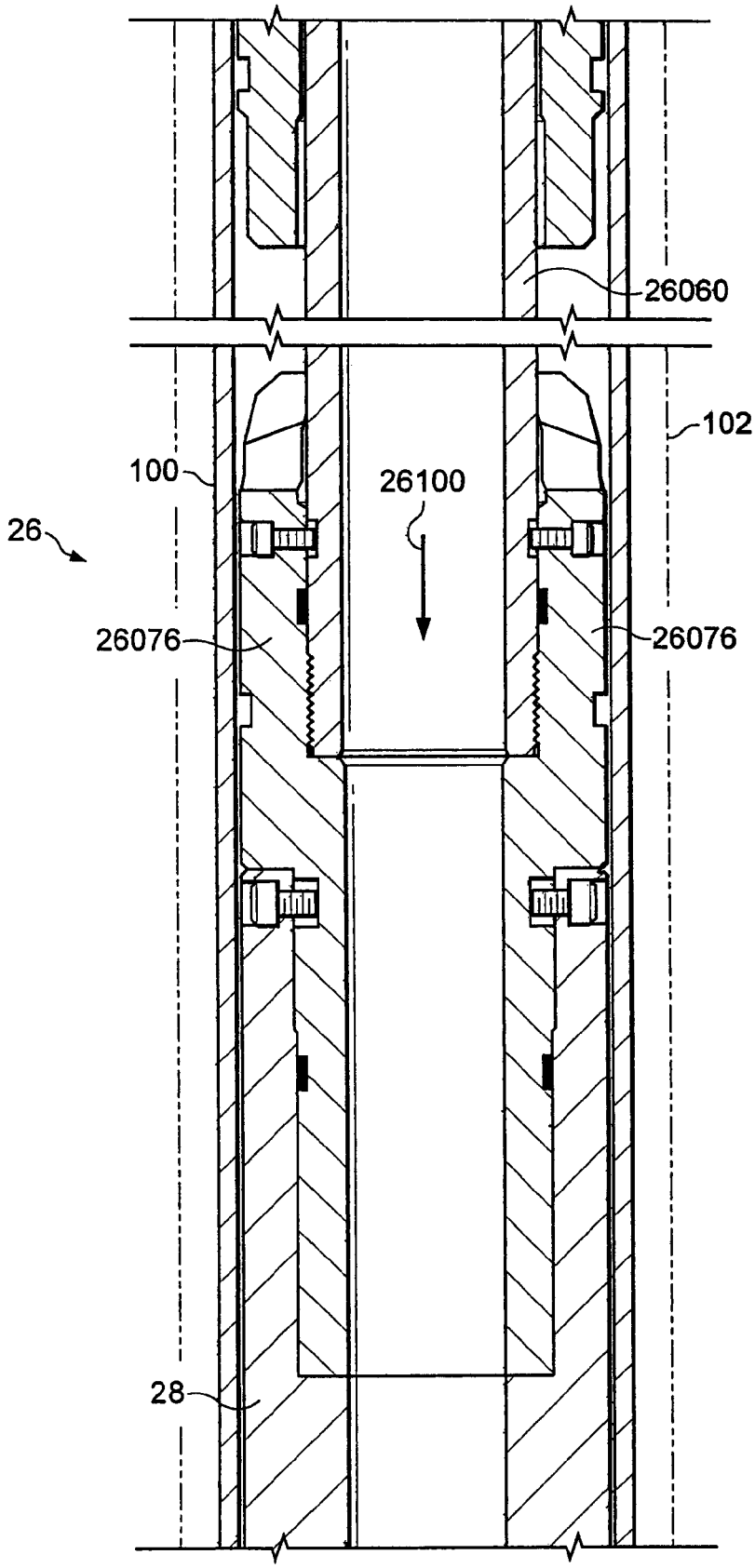
*Fig. 15F5*

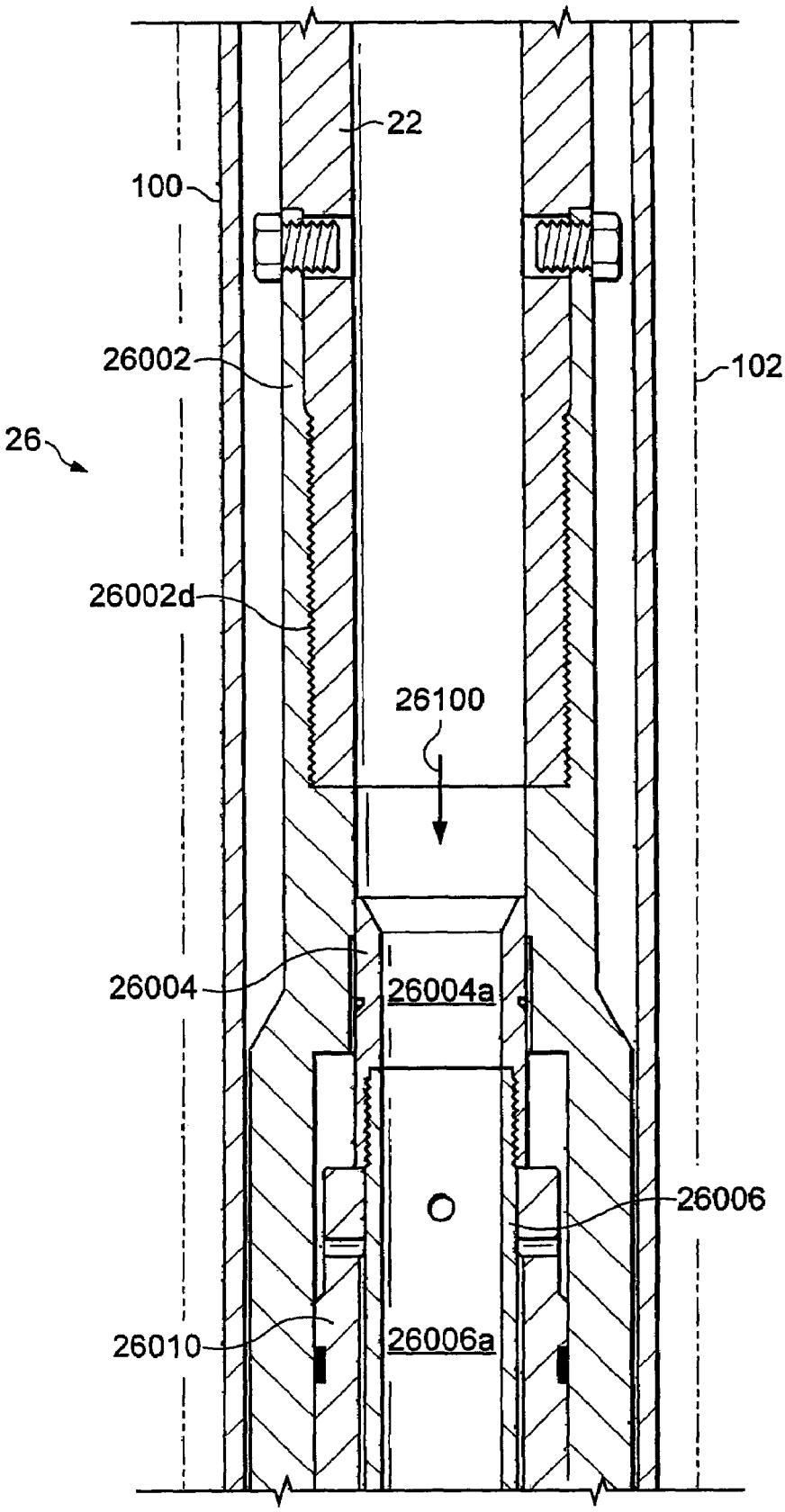
*Fig. 15G1*

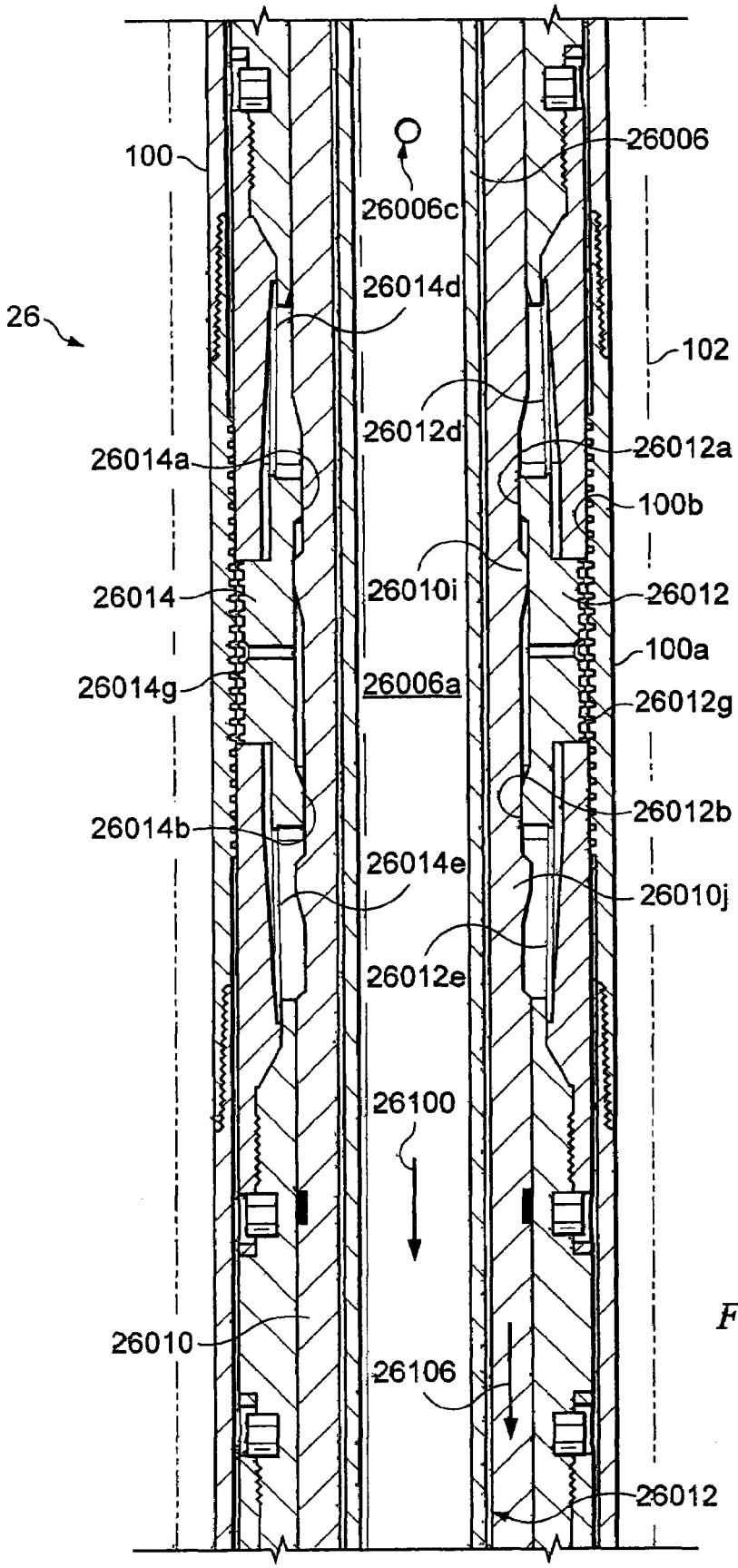
*Fig. 15G2*

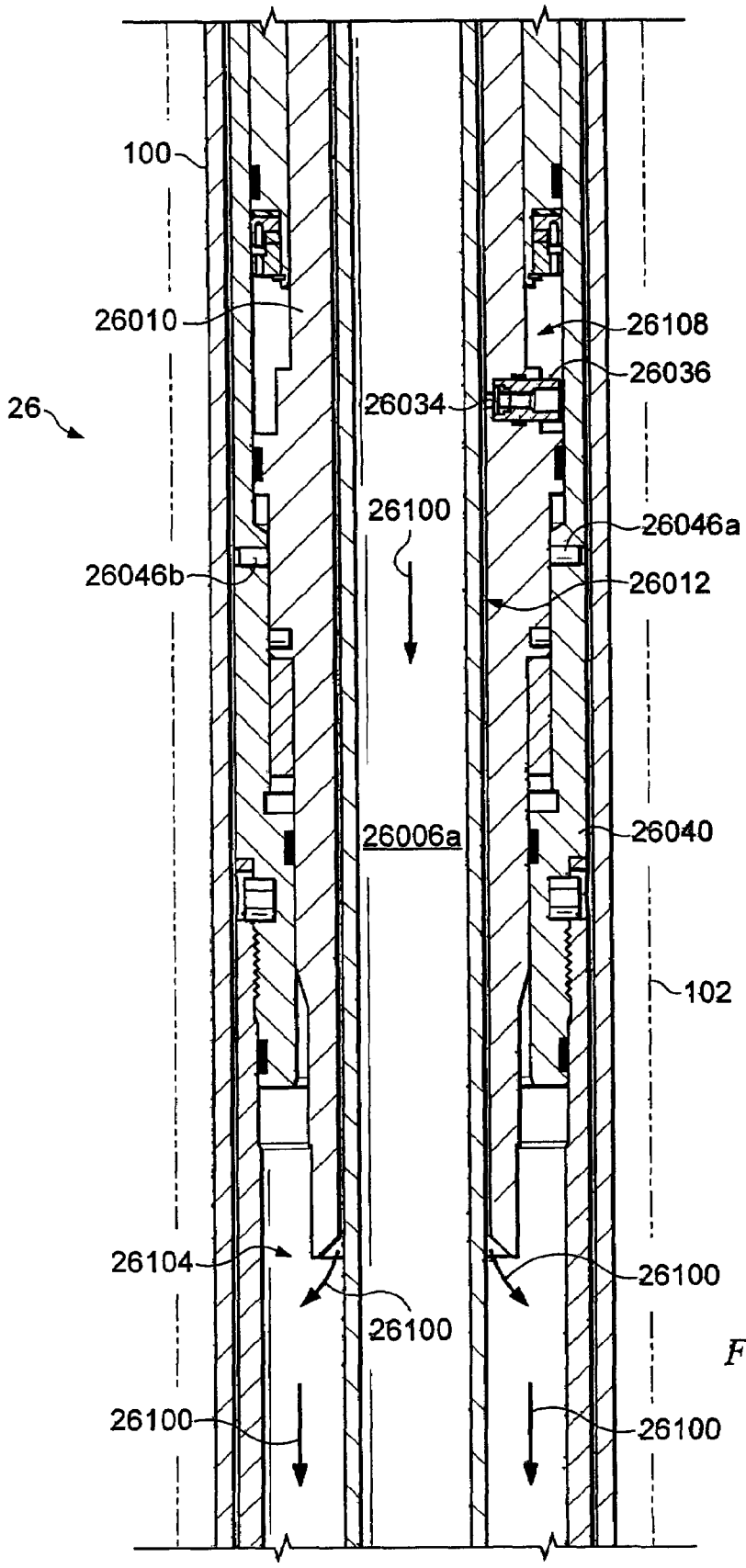
*Fig. 15G3*

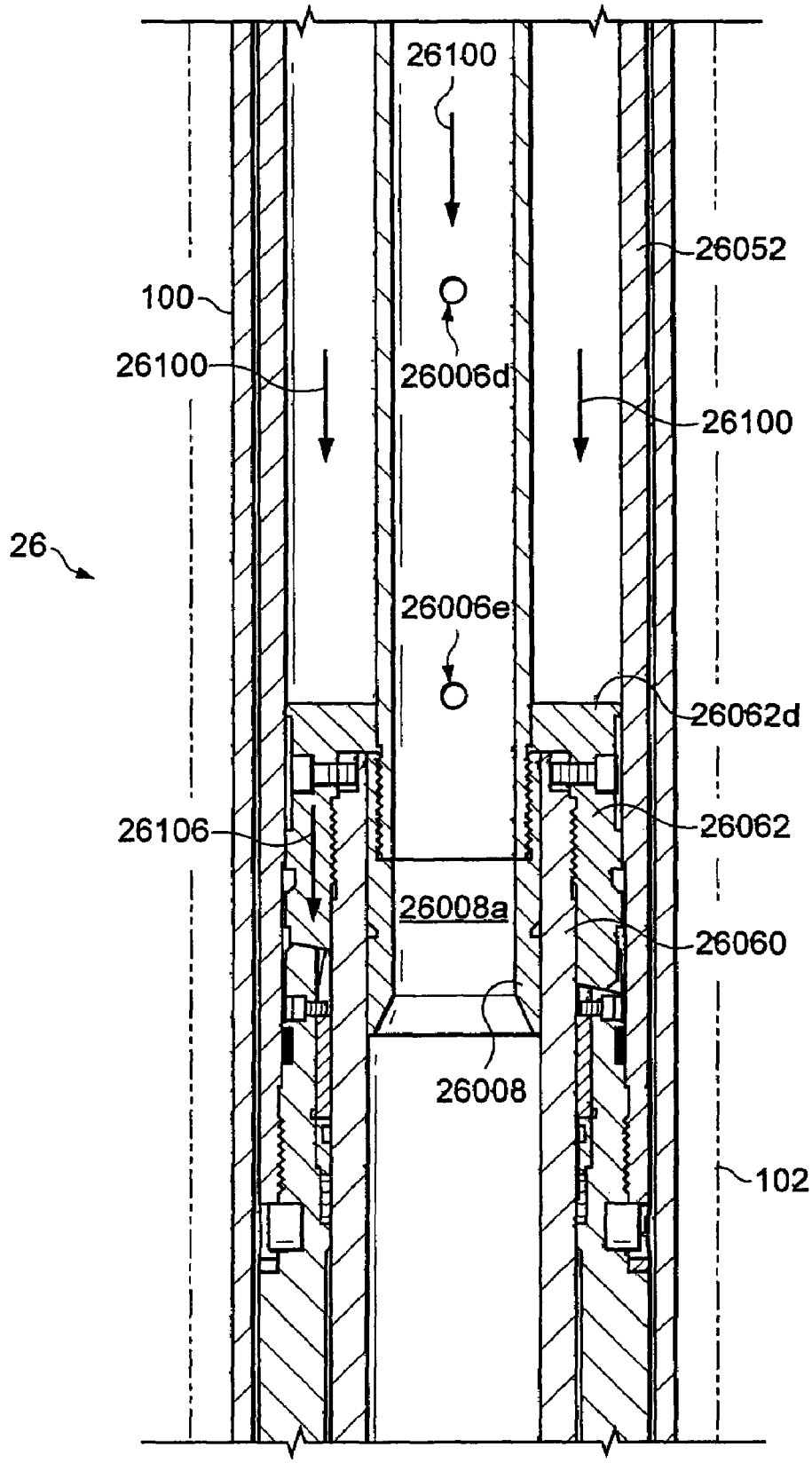
*Fig. 15G4*

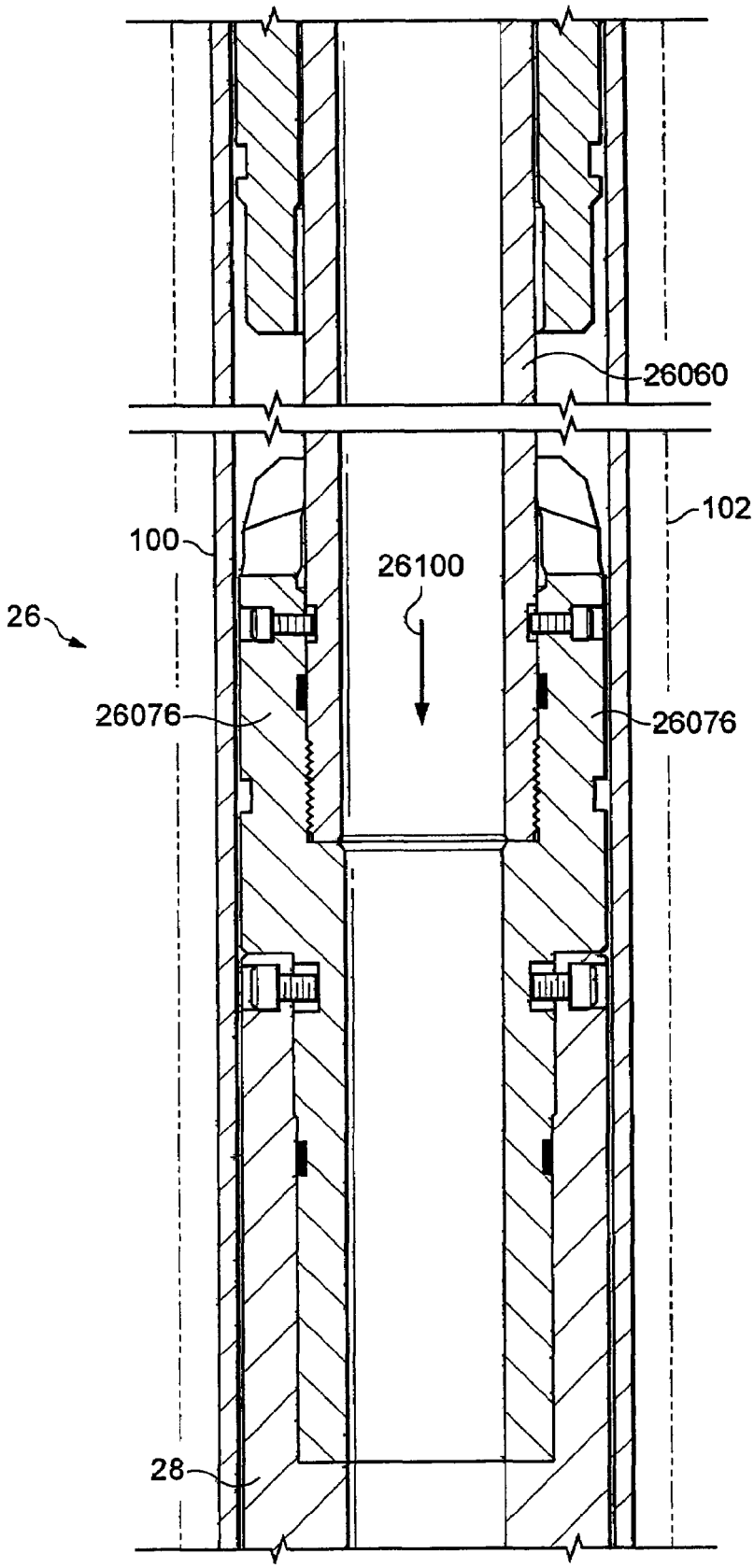
*Fig. 15G5*

*Fig. 16A1*
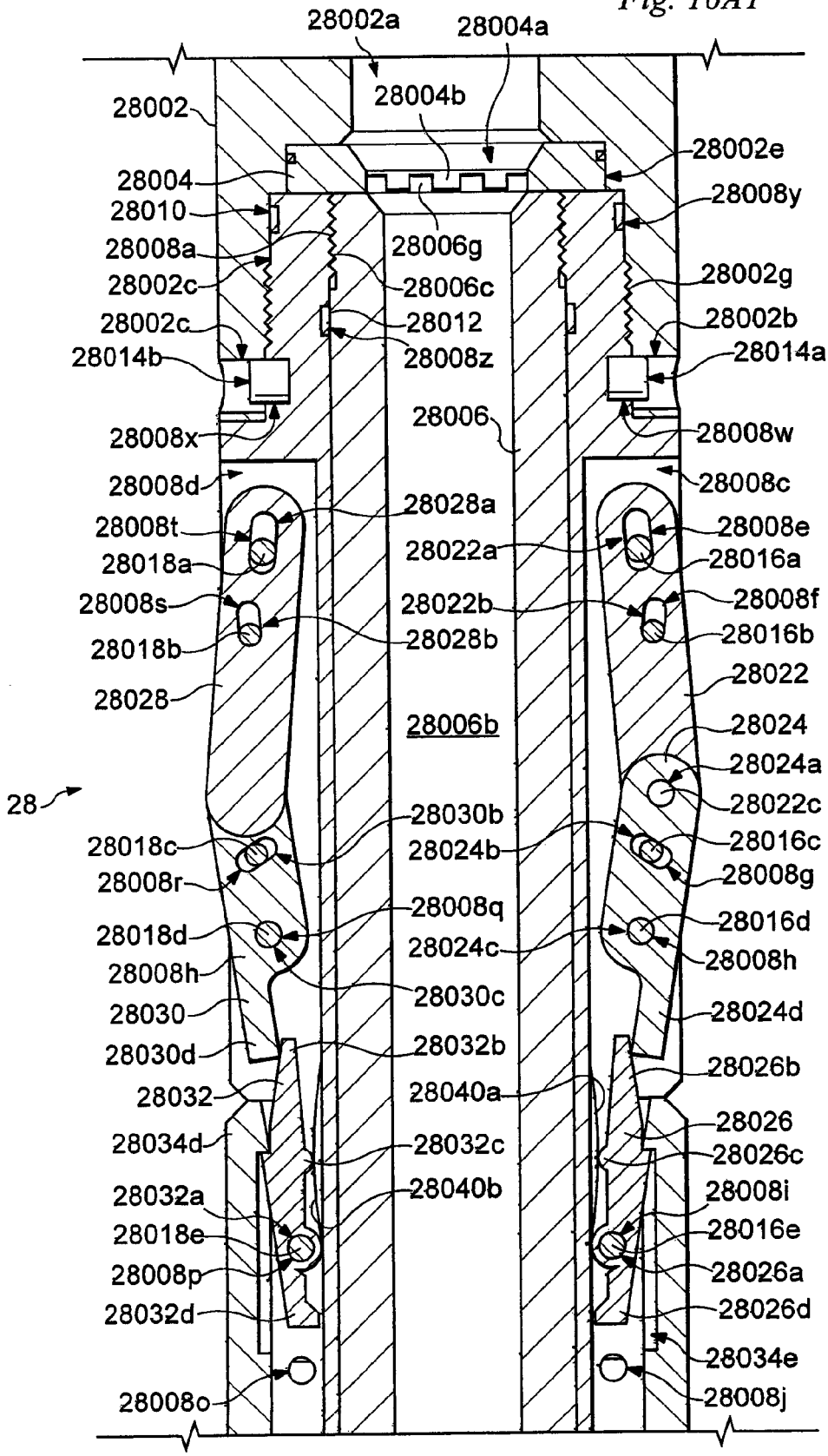

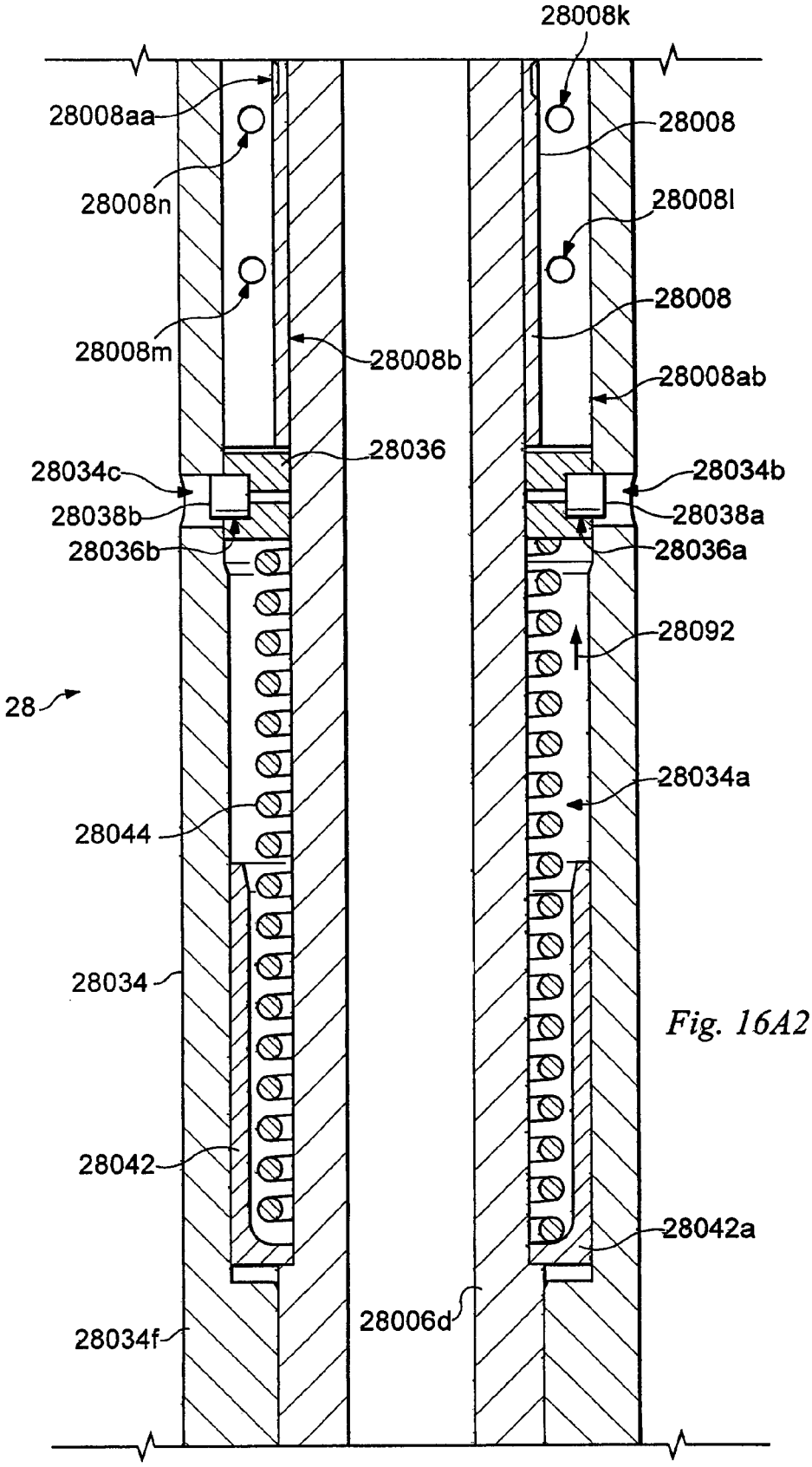
*Fig. 16A2*

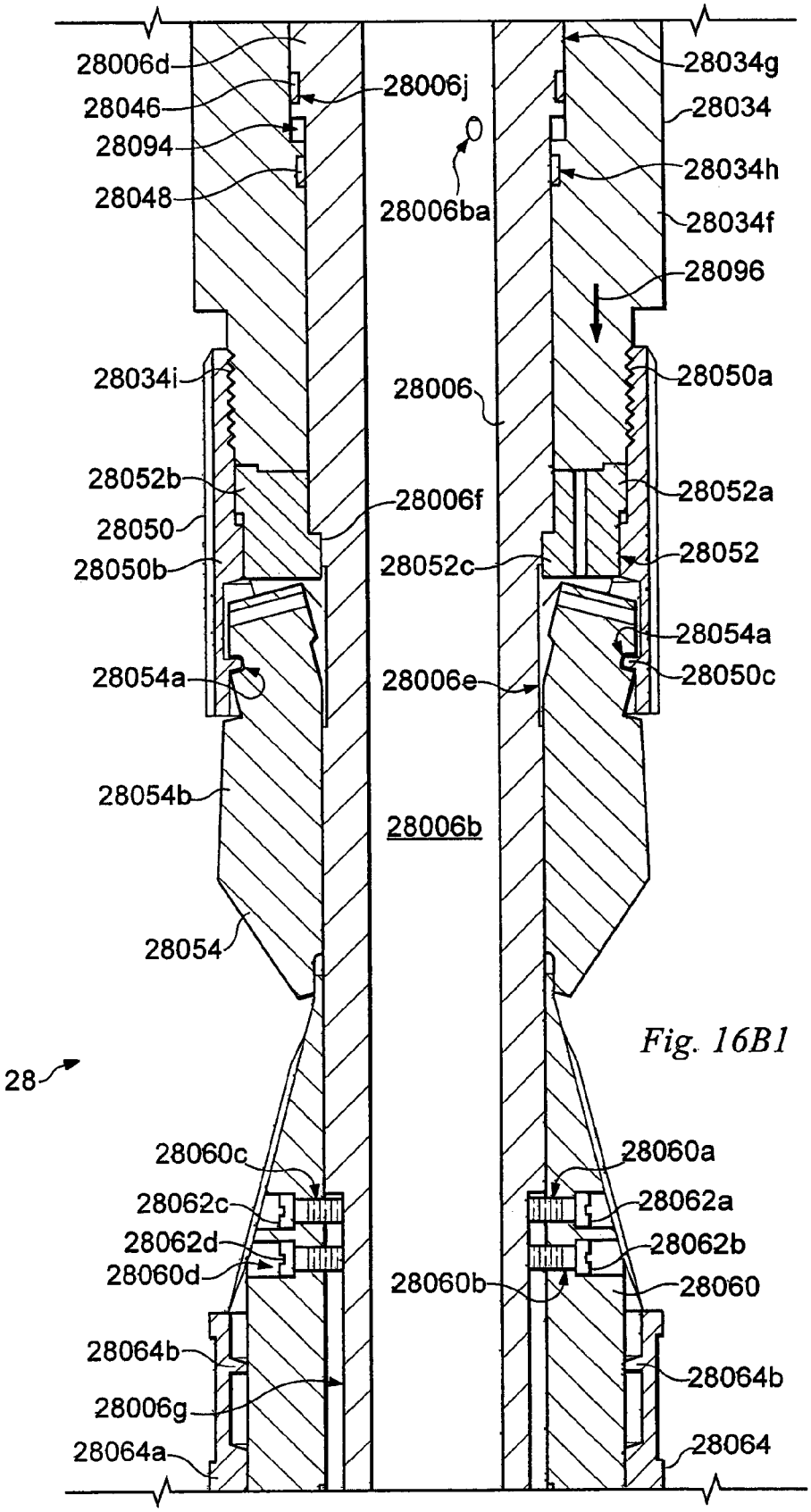
*Fig. 16B1*

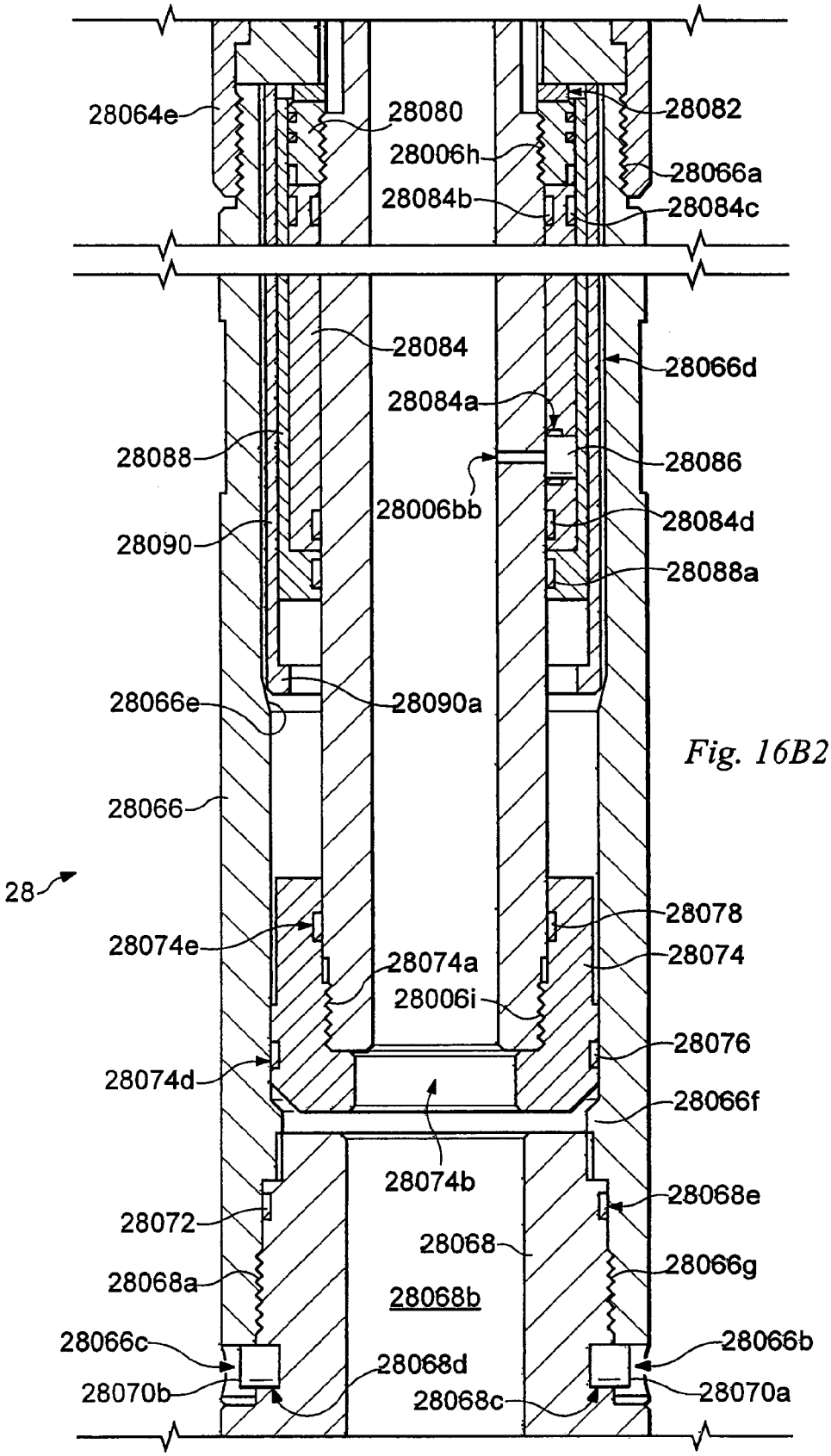
*Fig. 16B2*

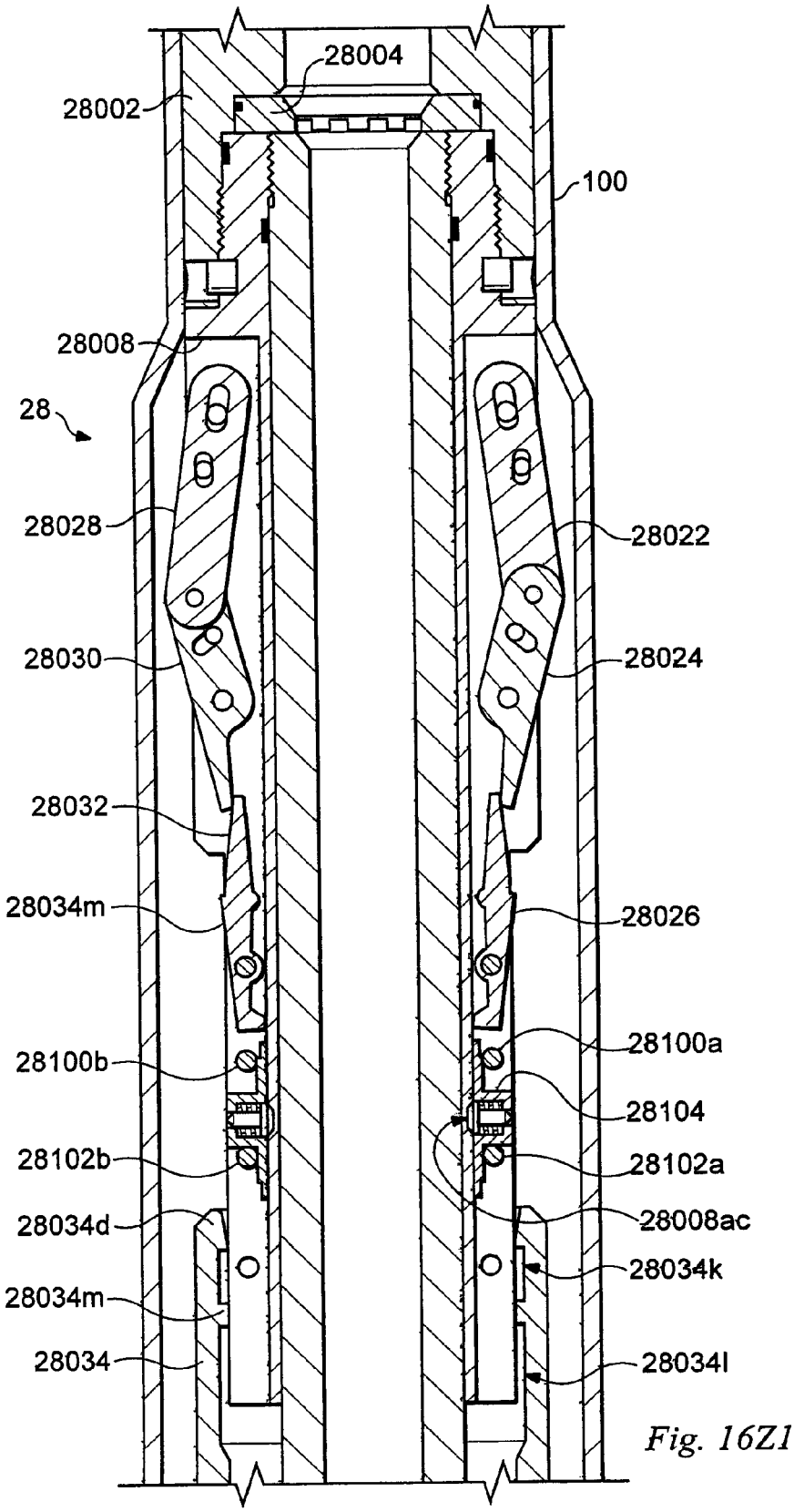
*Fig. 16Z1*

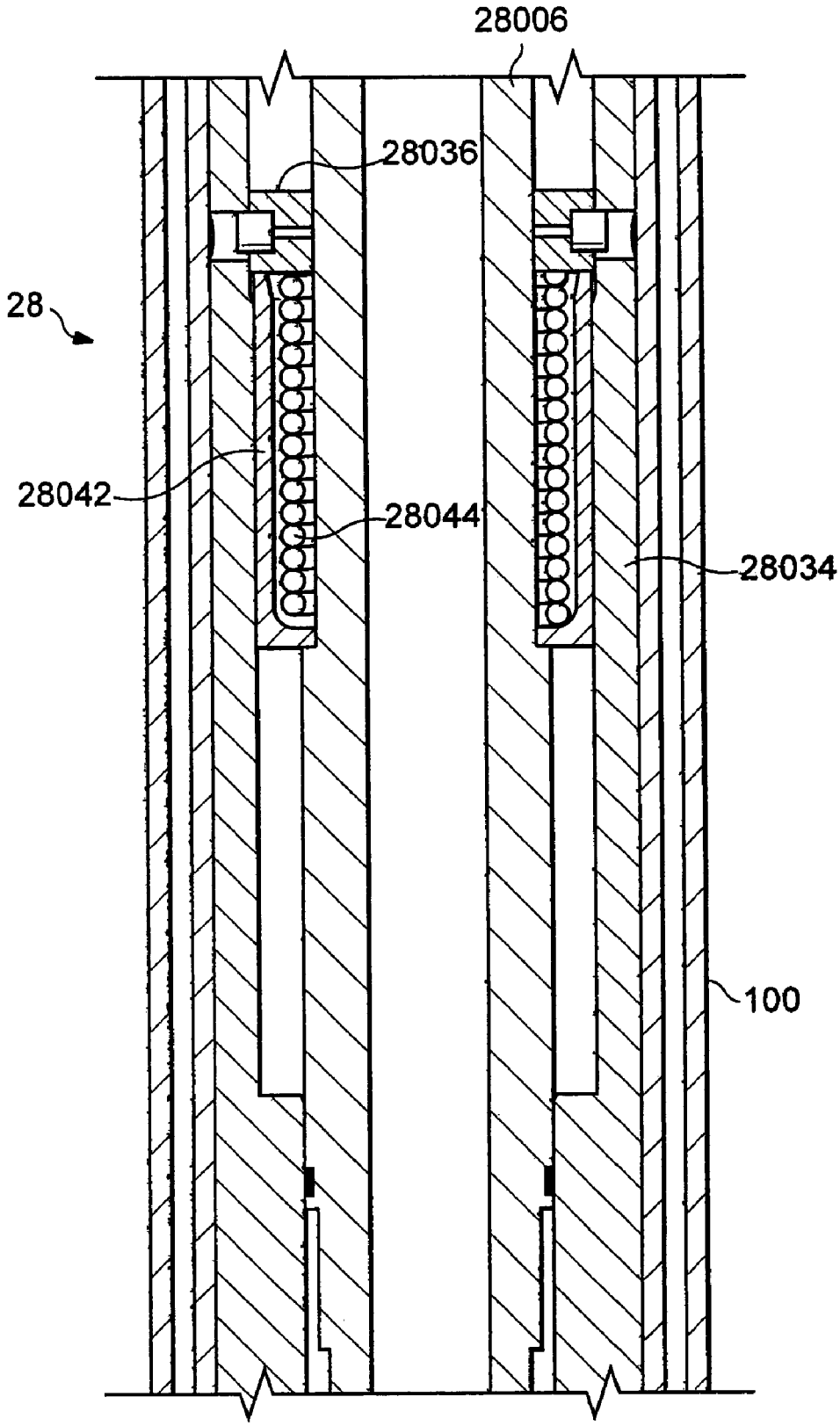
*Fig. 16Z2*

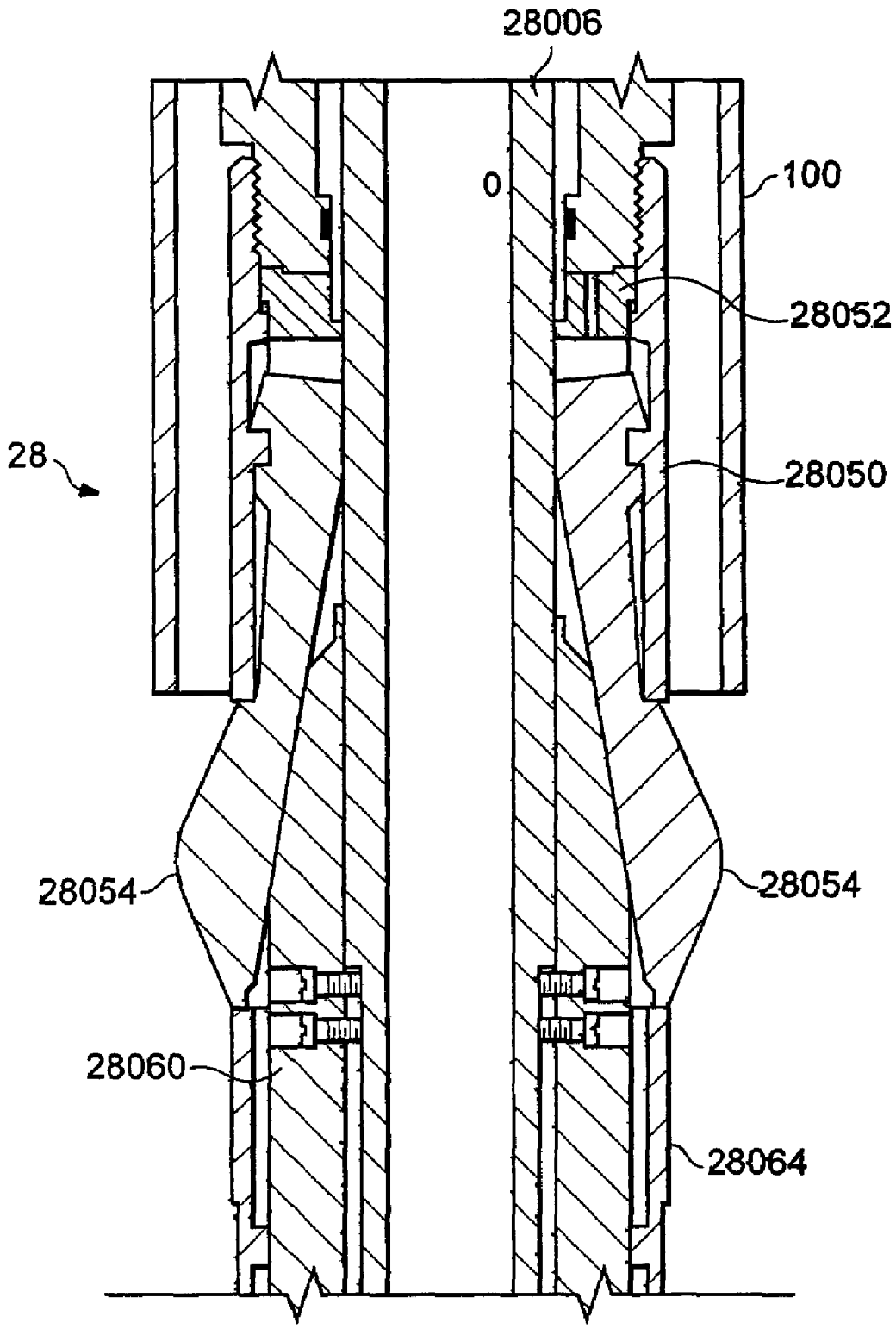
*Fig. 16Z3*

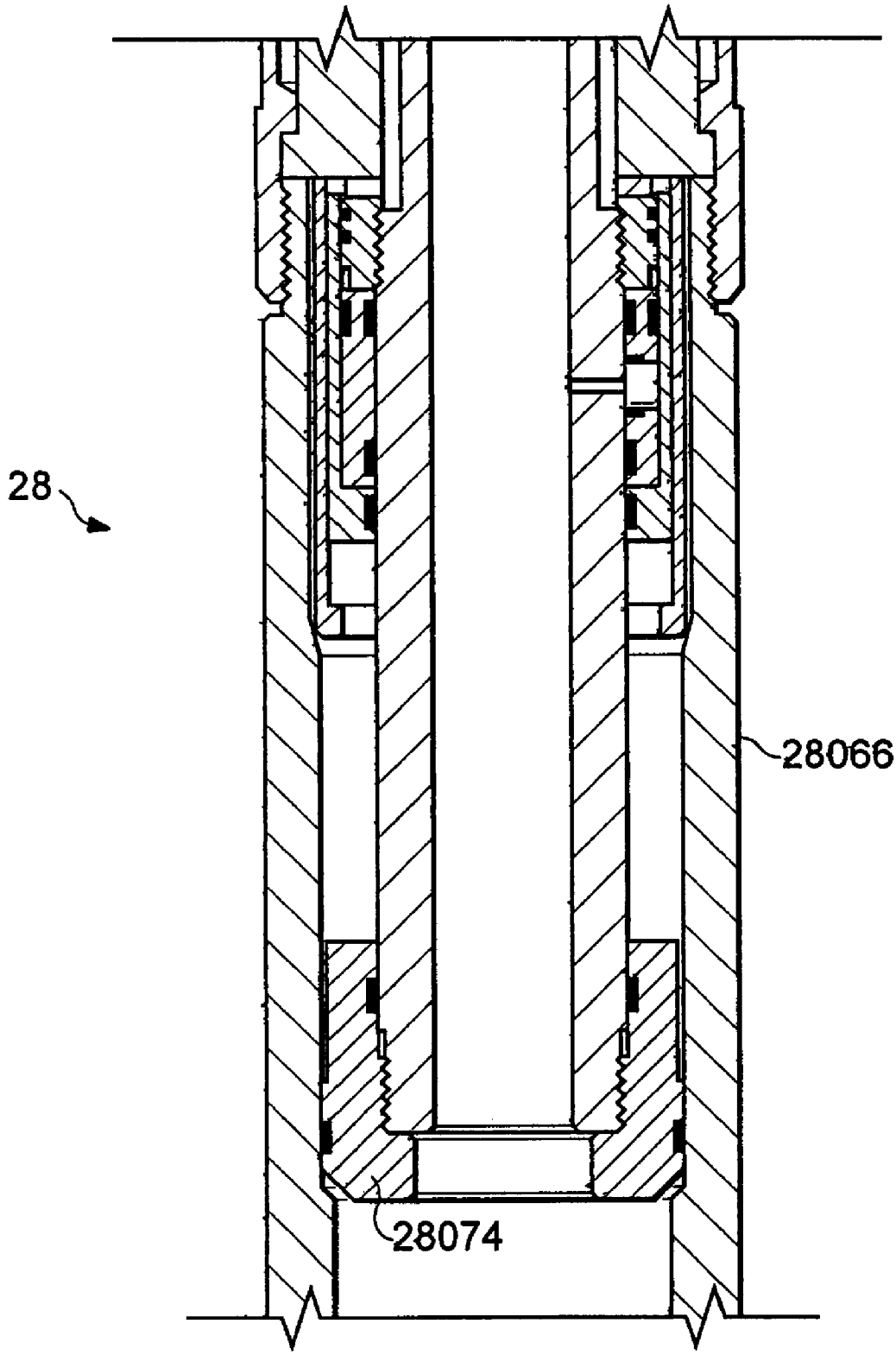
*Fig. 16Z4*

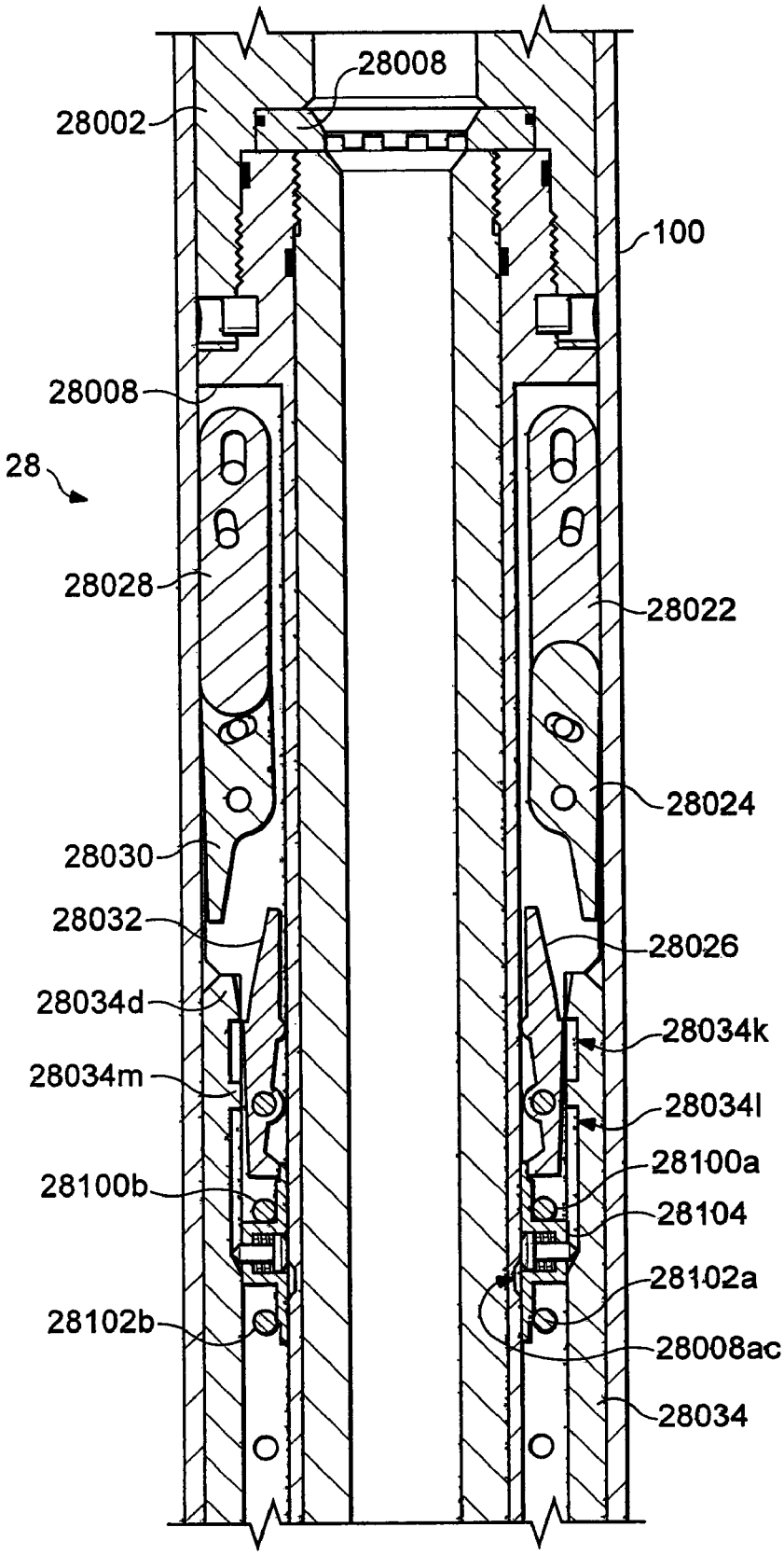
*Fig. 16AA1*

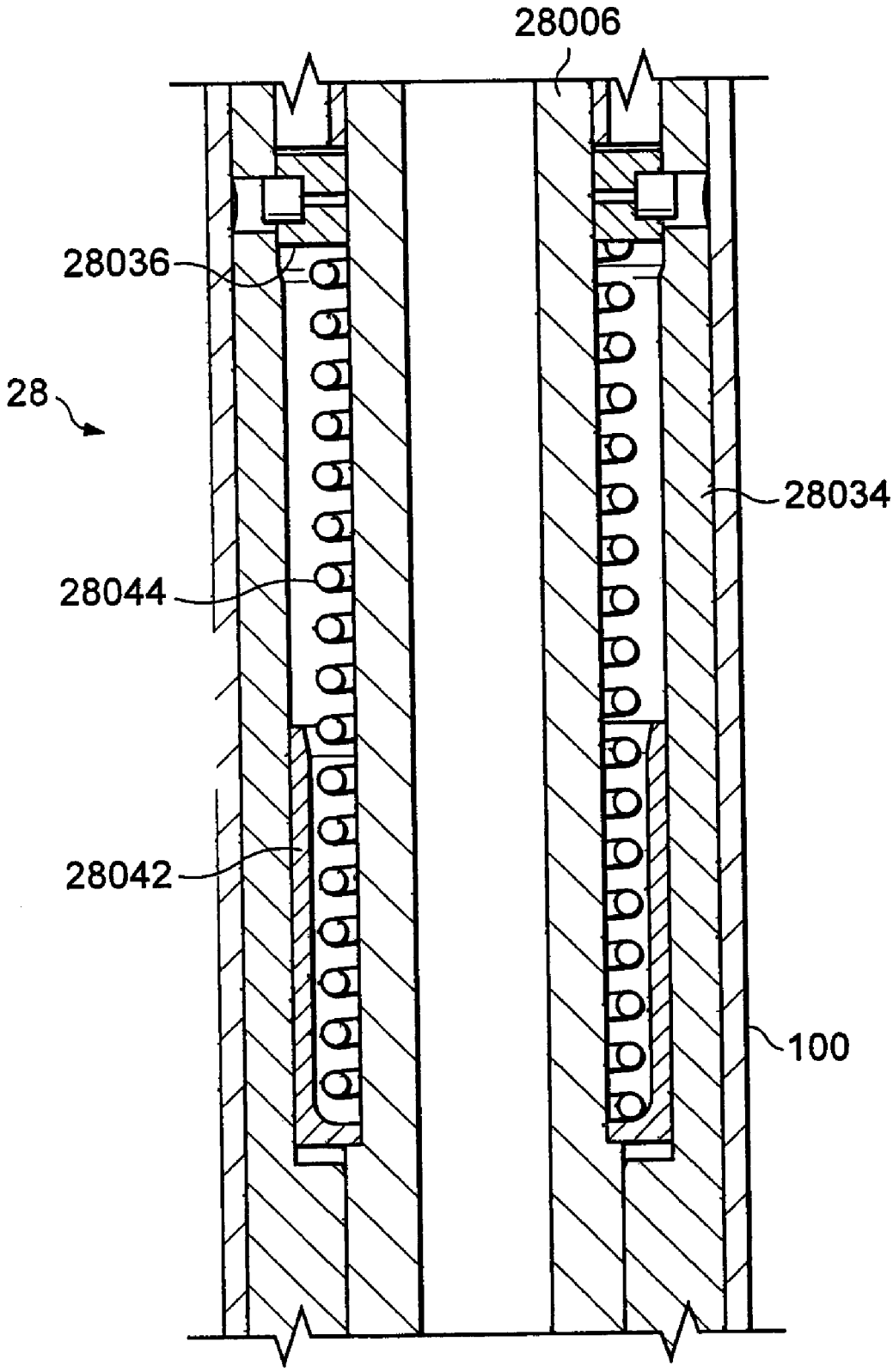
*Fig. 16AA2*

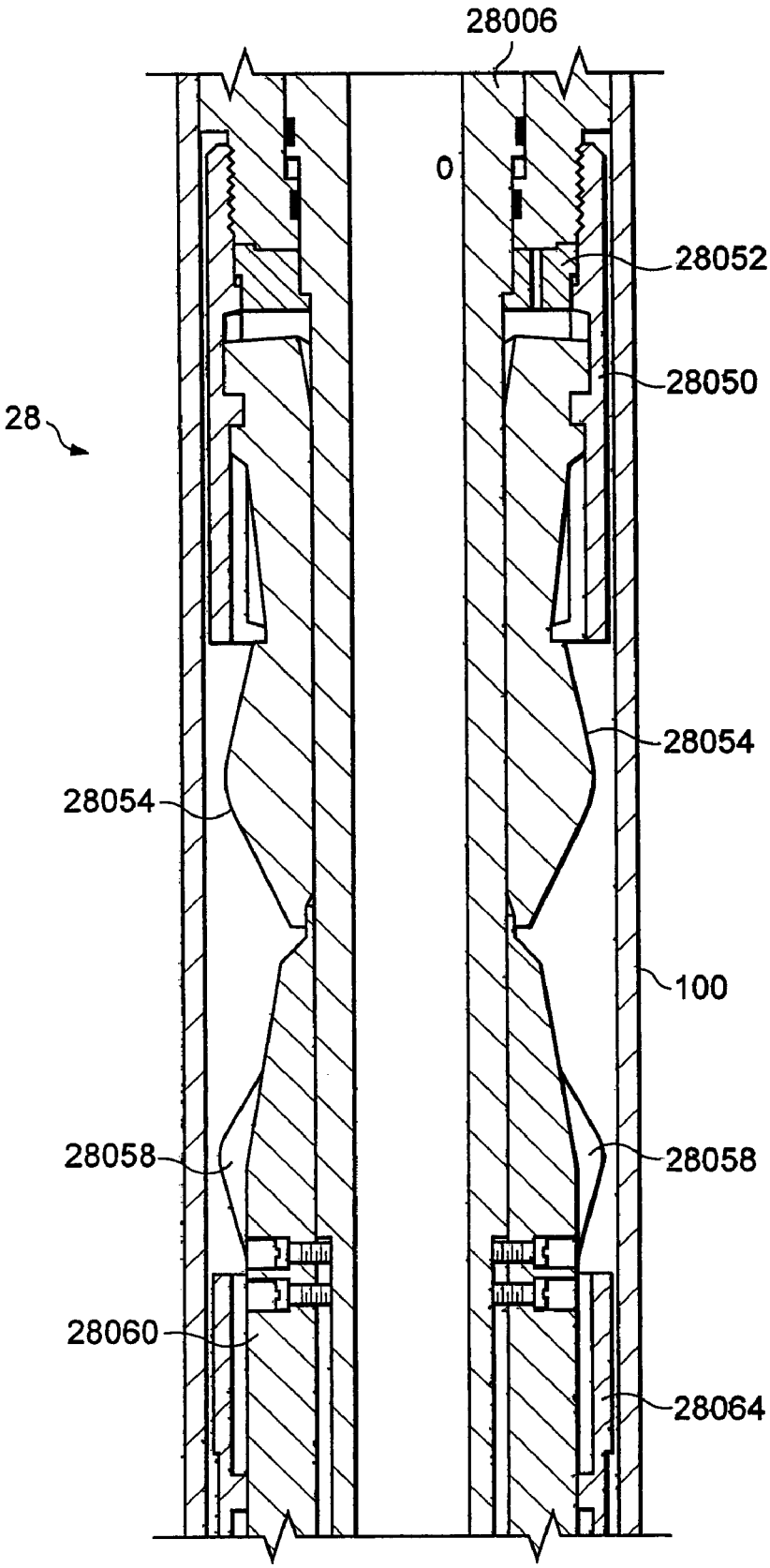
*Fig. 16AA3*

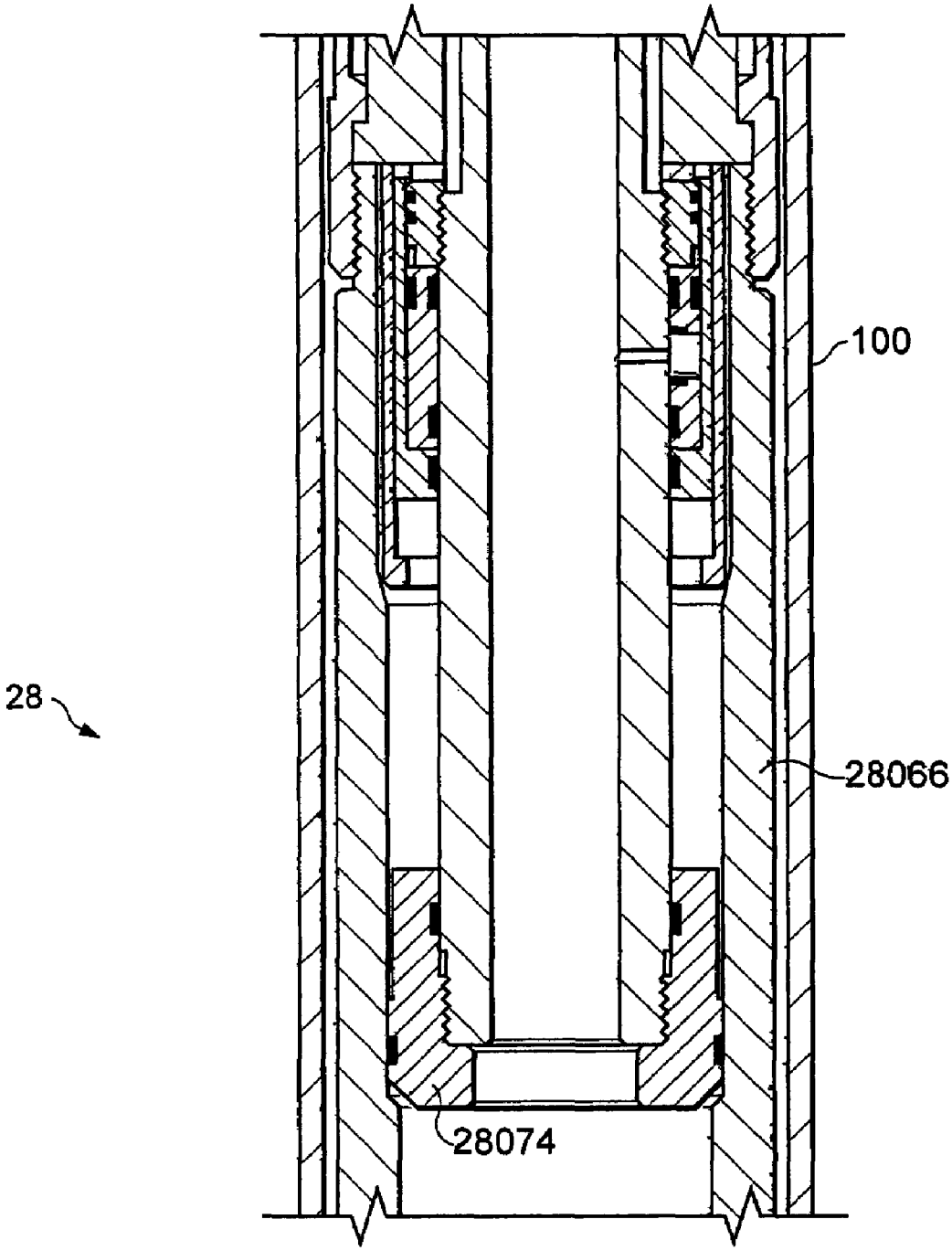
*Fig. 16AA4*

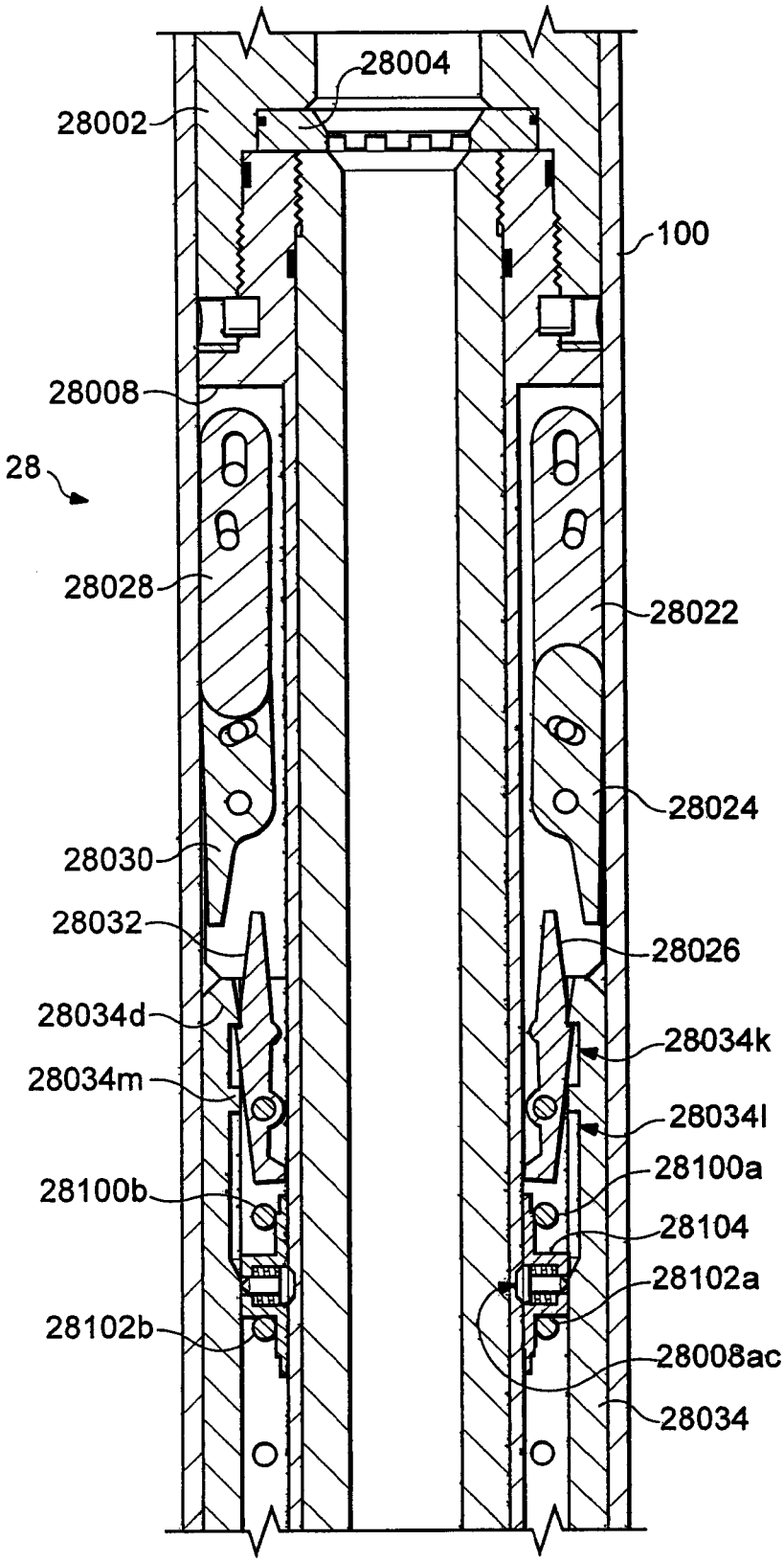
*Fig. 16AB1*

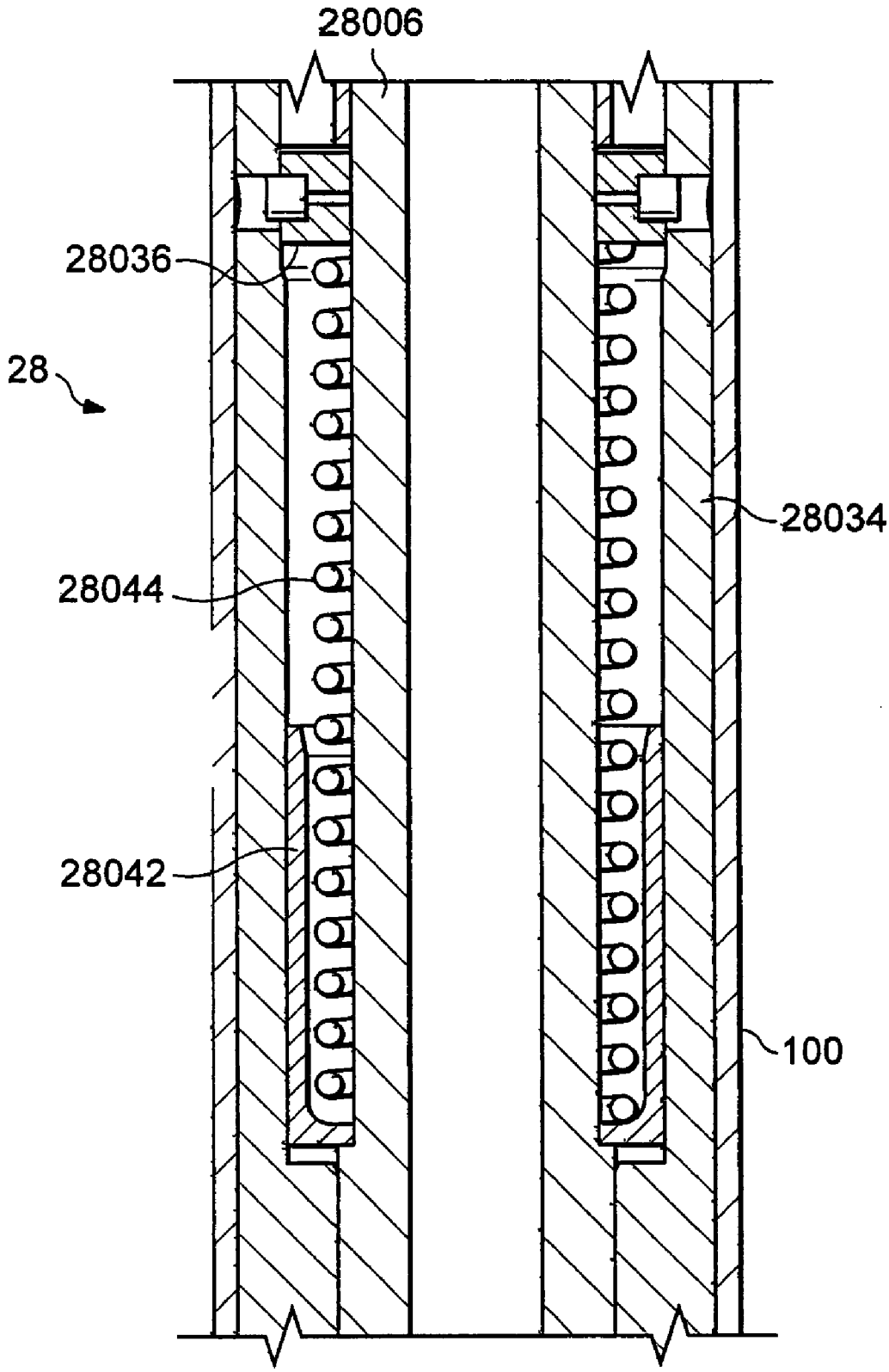
*Fig. 16AB2*

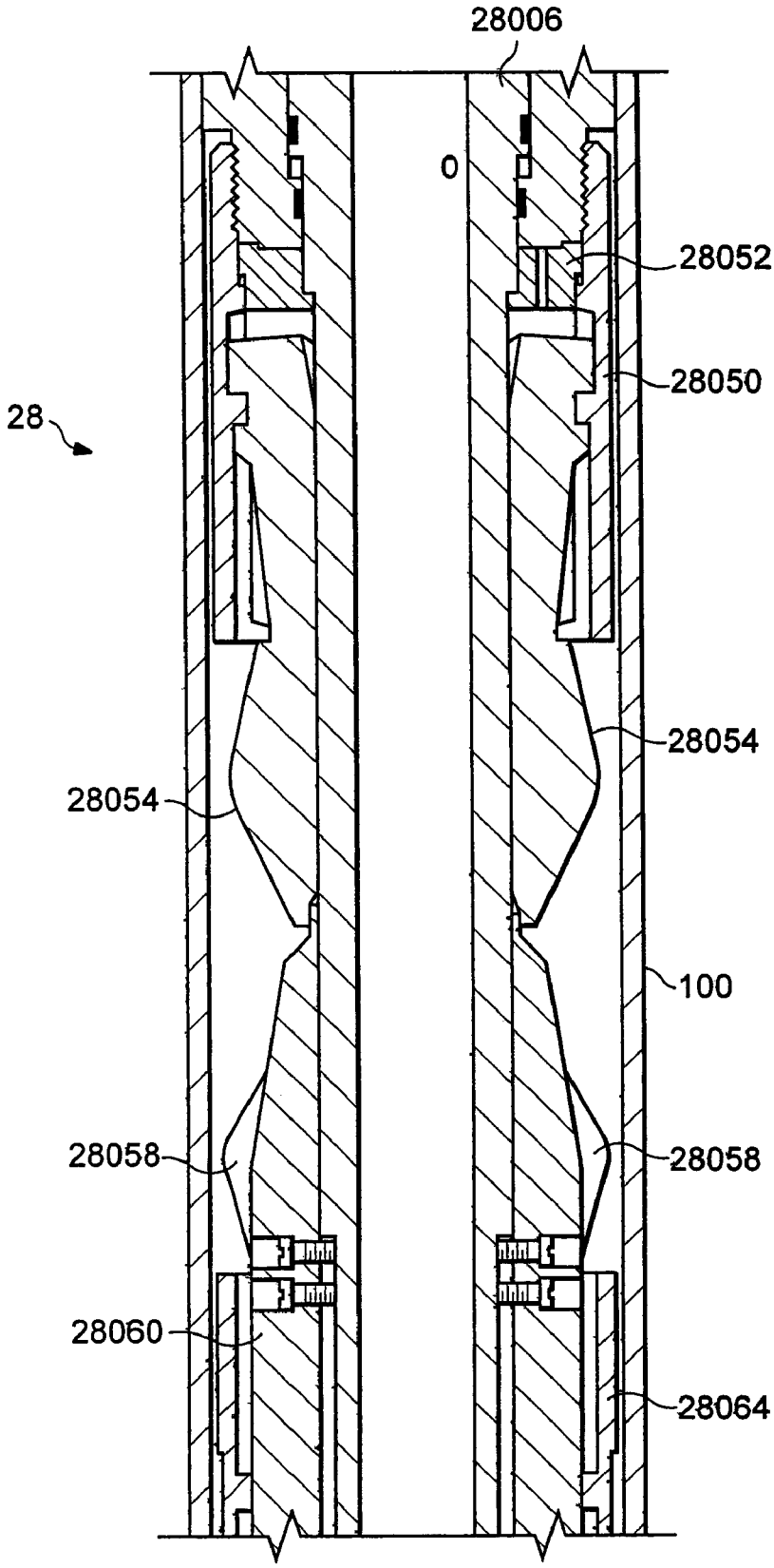
*Fig. 16AB3*

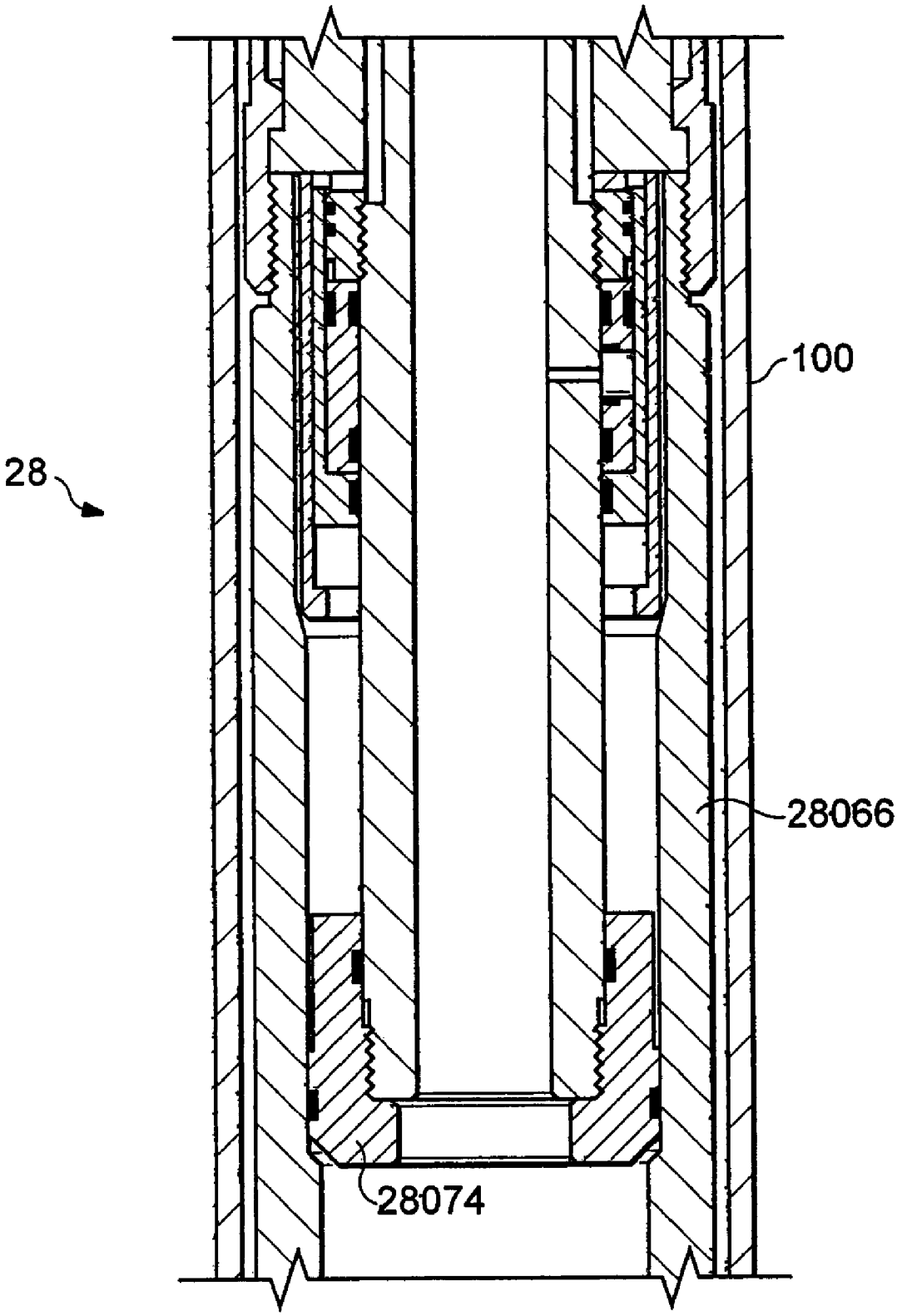
*Fig. 16AB4*

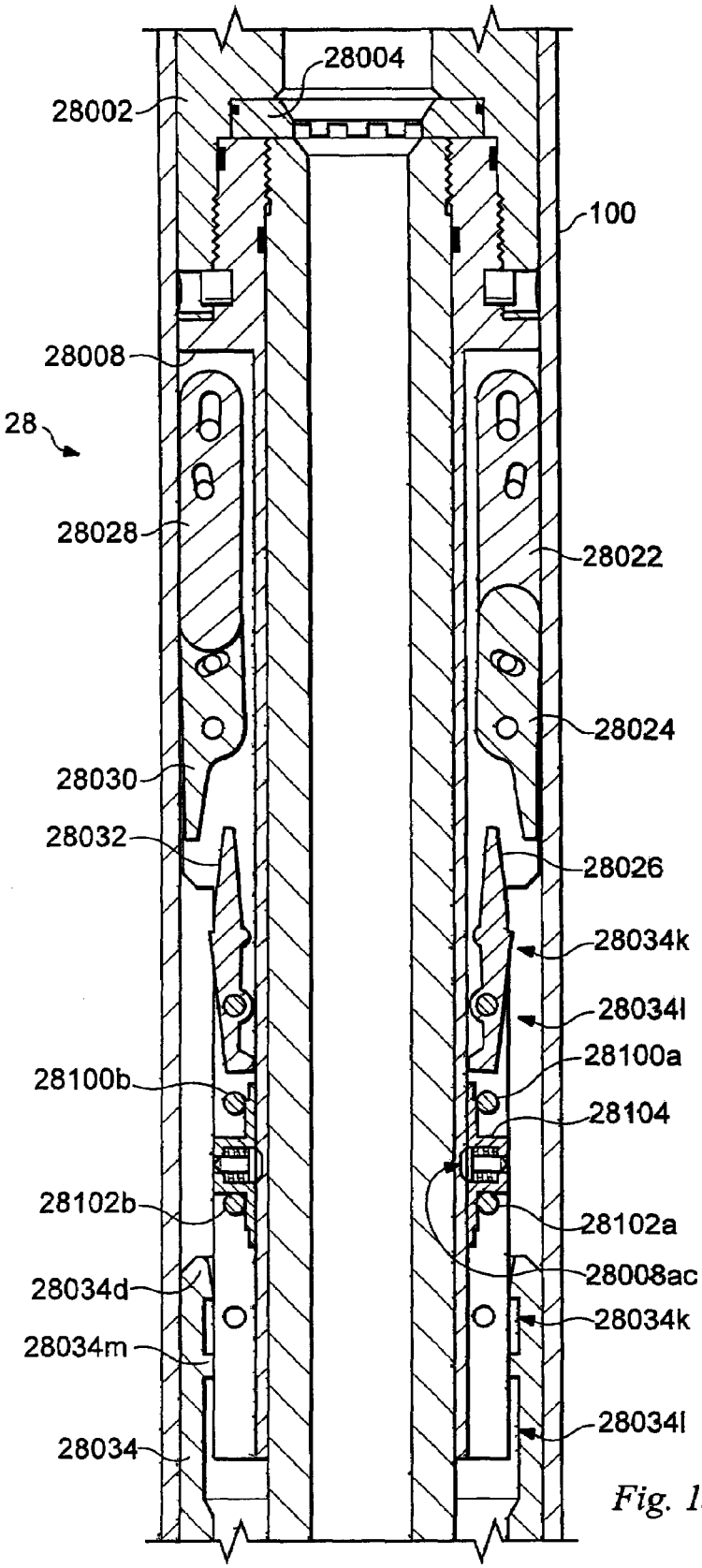
*Fig. 16AC1*

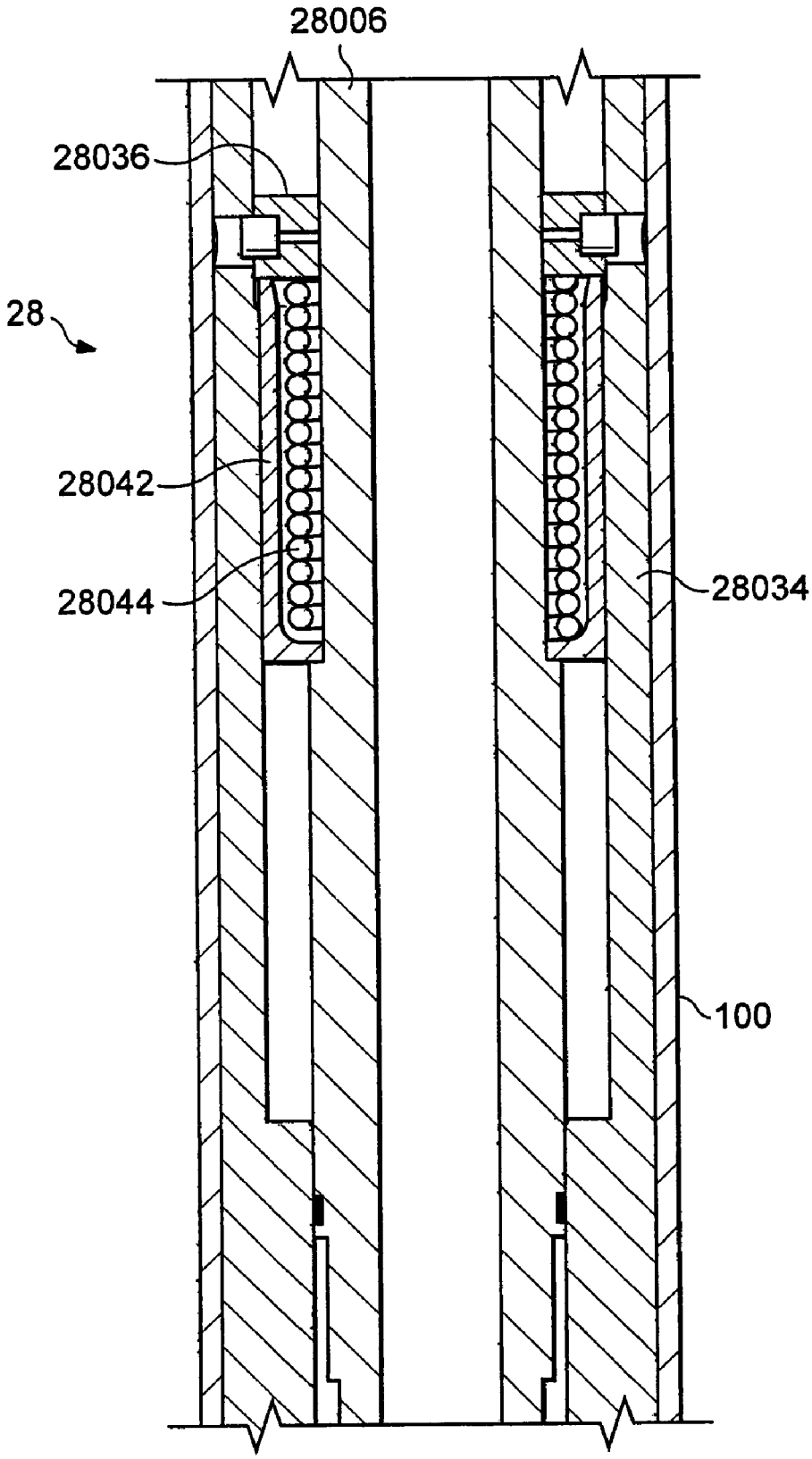
*Fig. 16AC2*

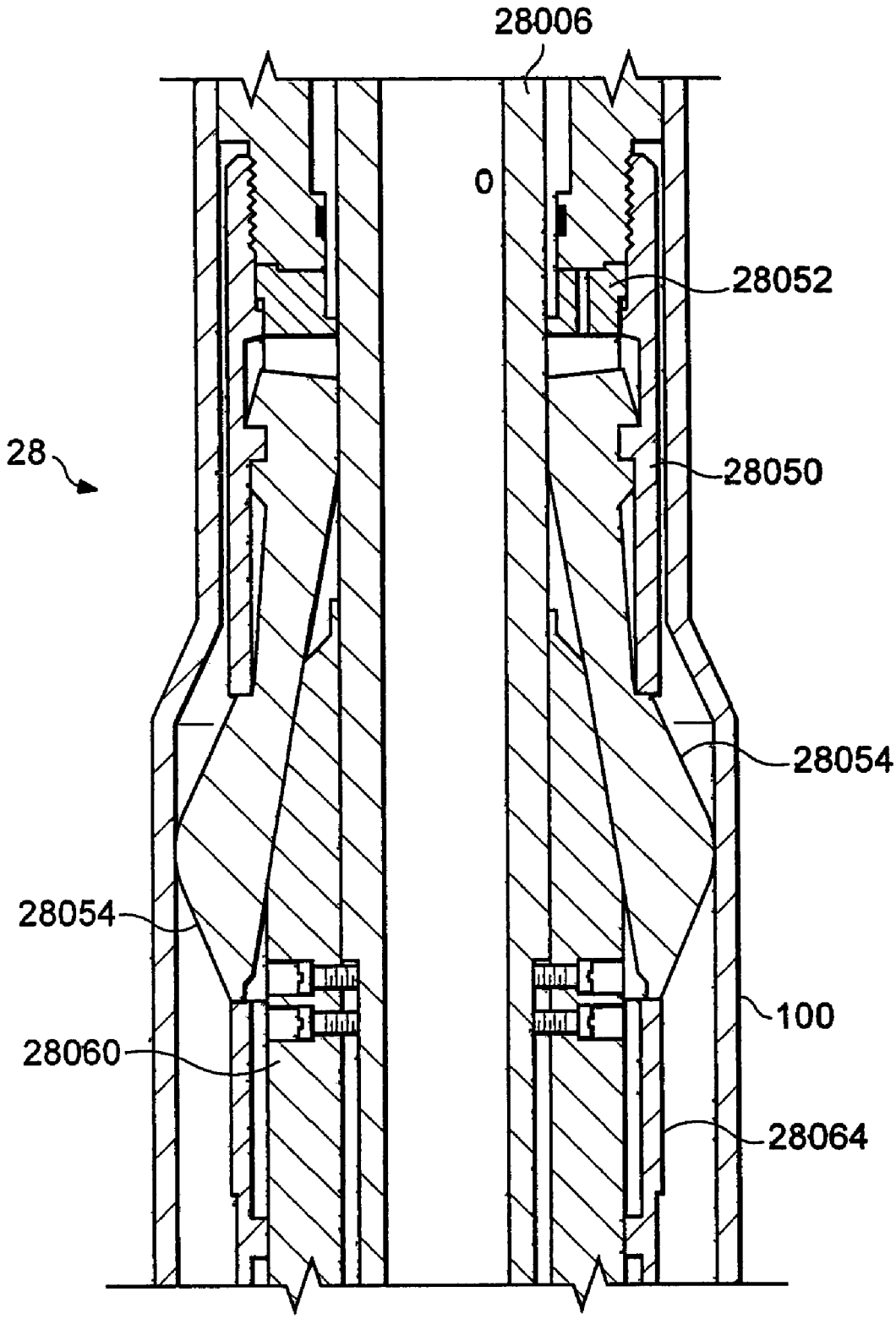
*Fig. 16AC3*

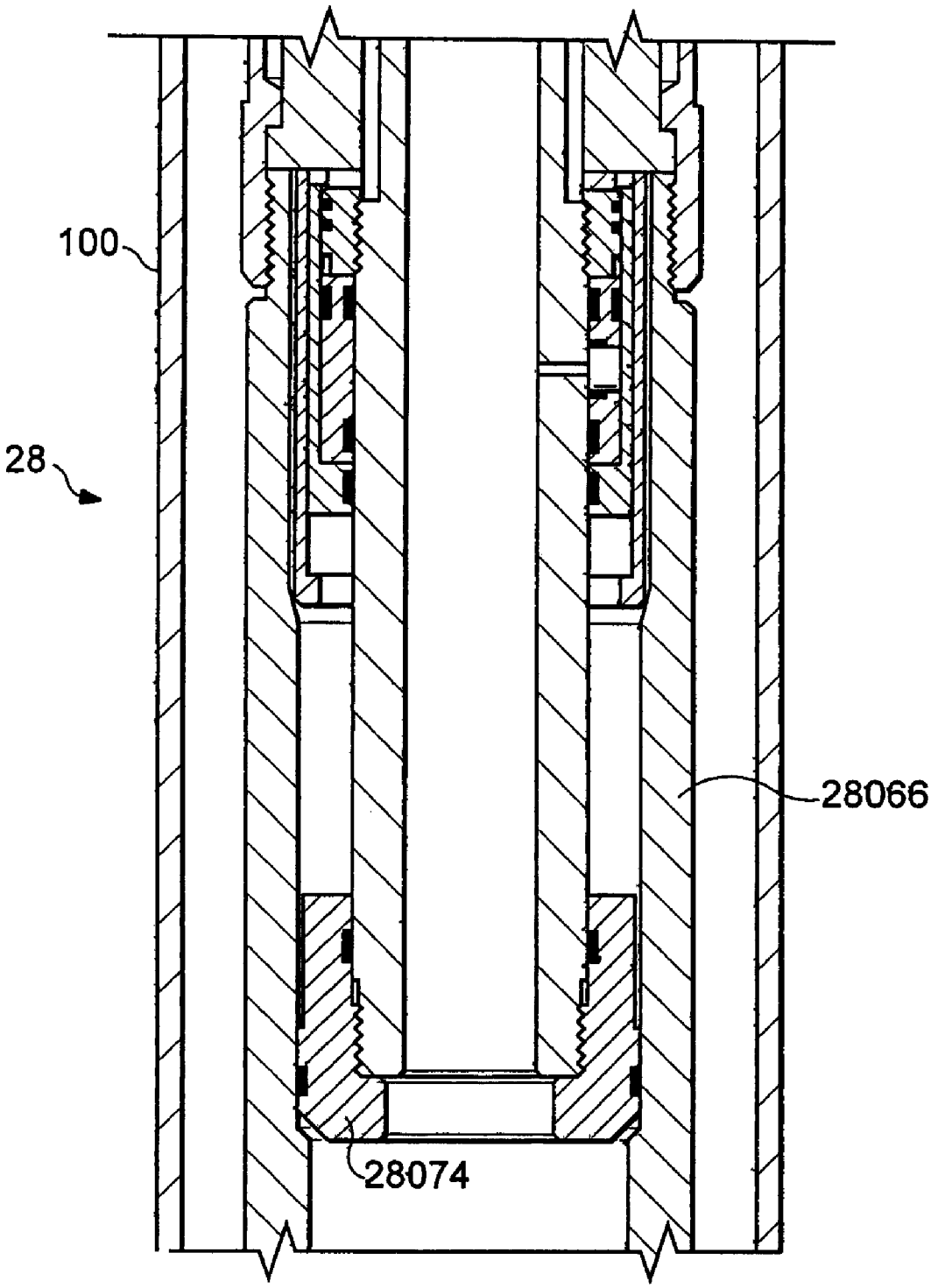
*Fig. 16AC4*

*Fig. 17A1*
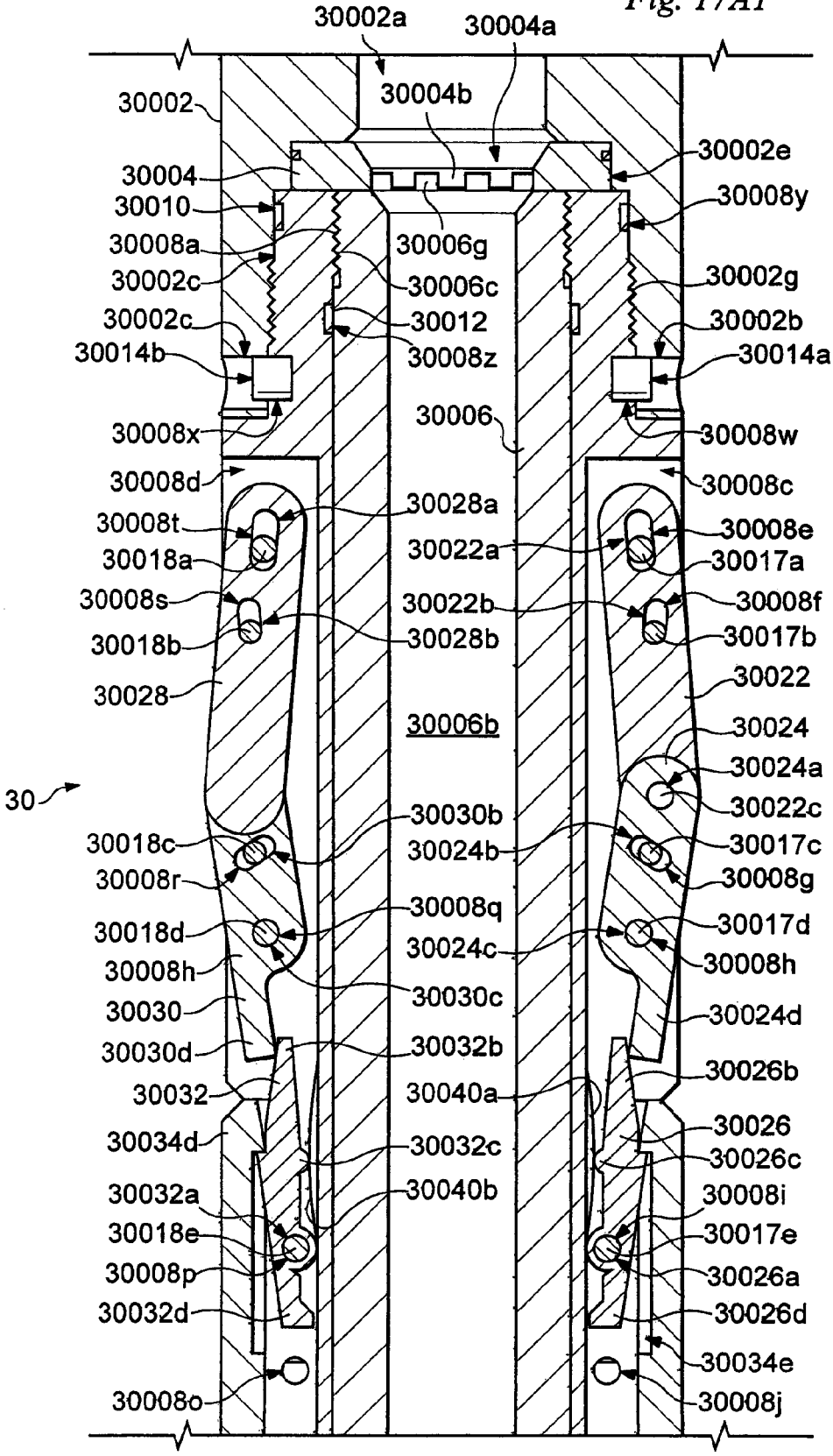

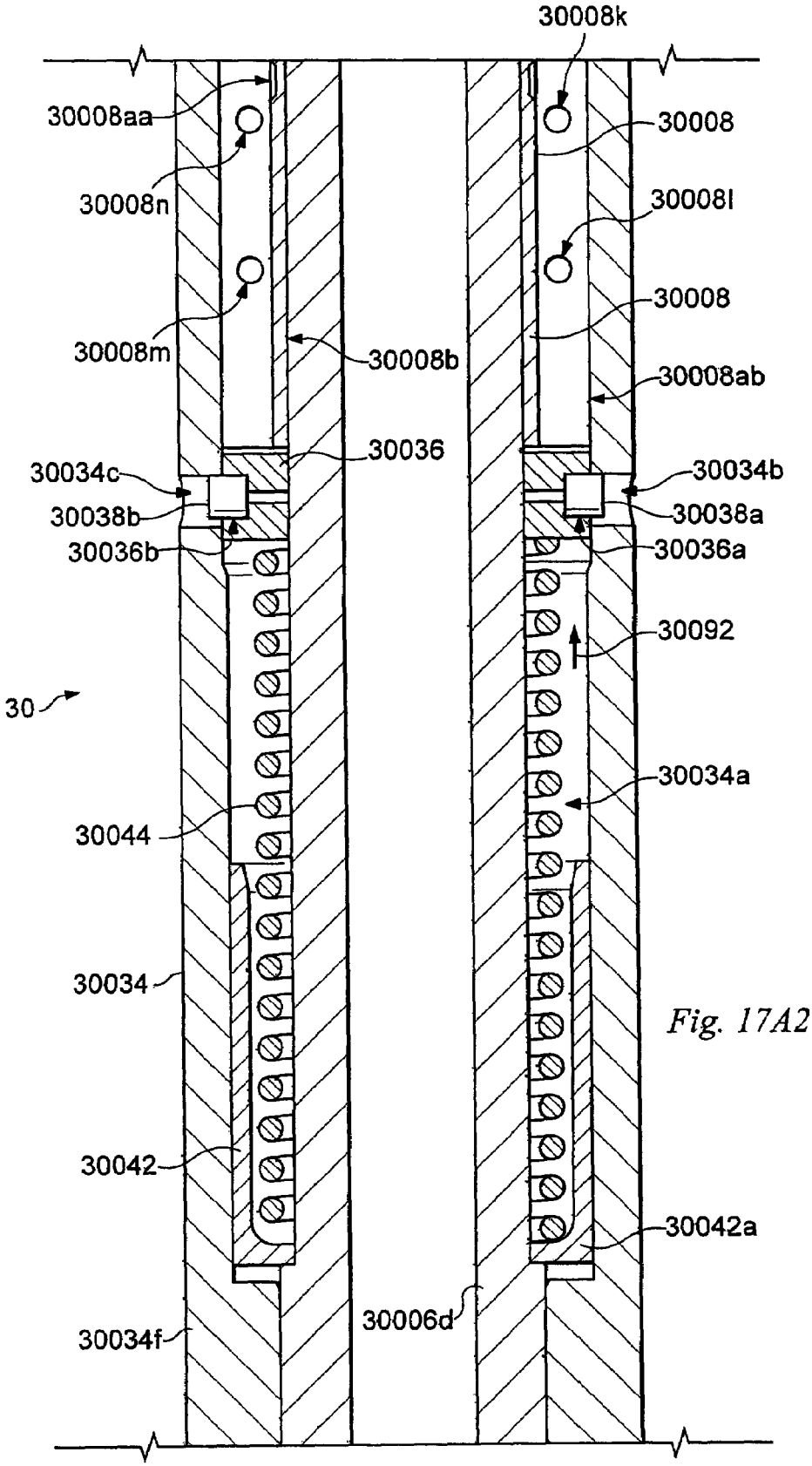
*Fig. 17A2*

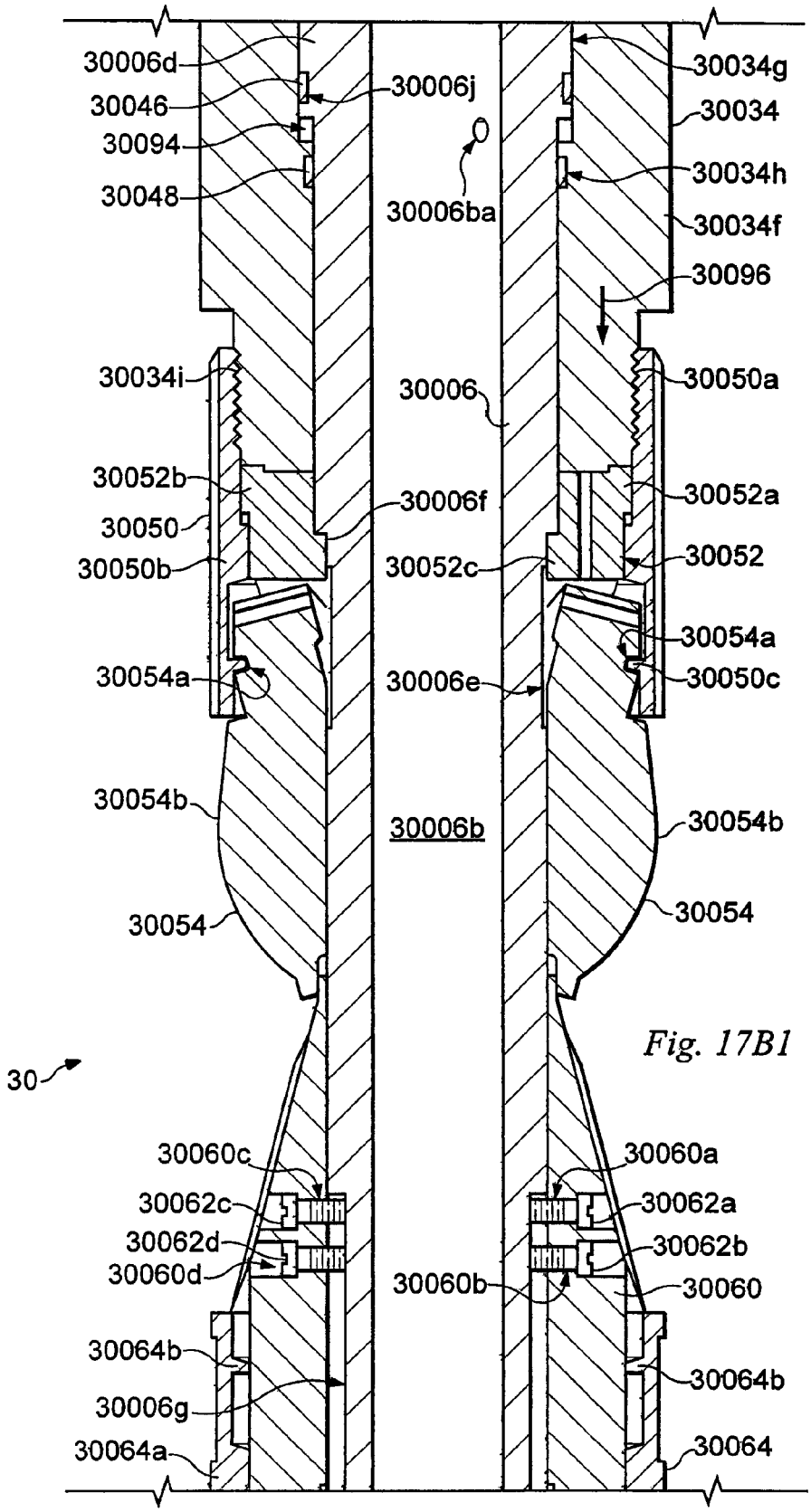
*Fig. 17B1*

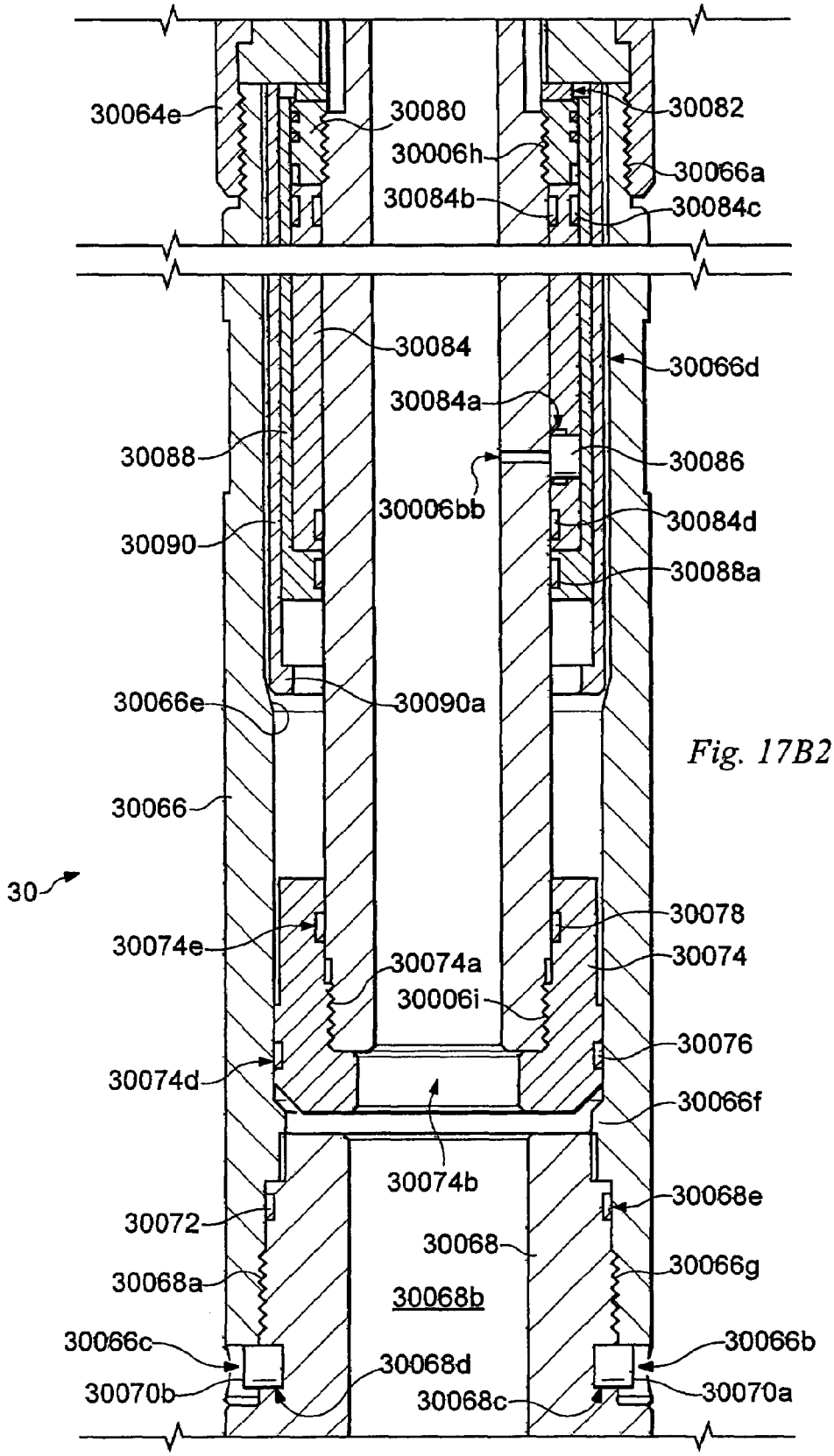
*Fig. 17B2*

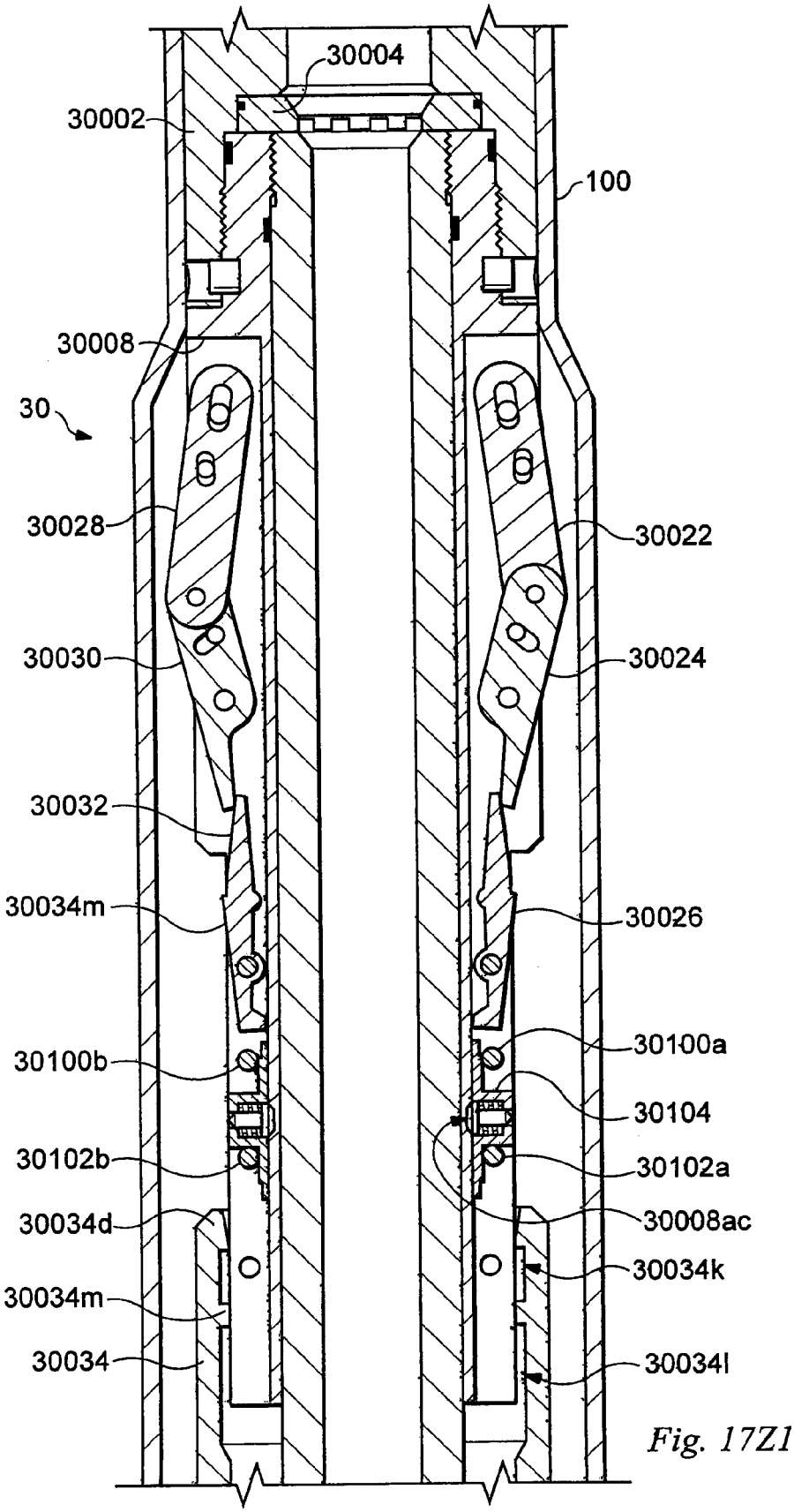
*Fig. 17Z1*

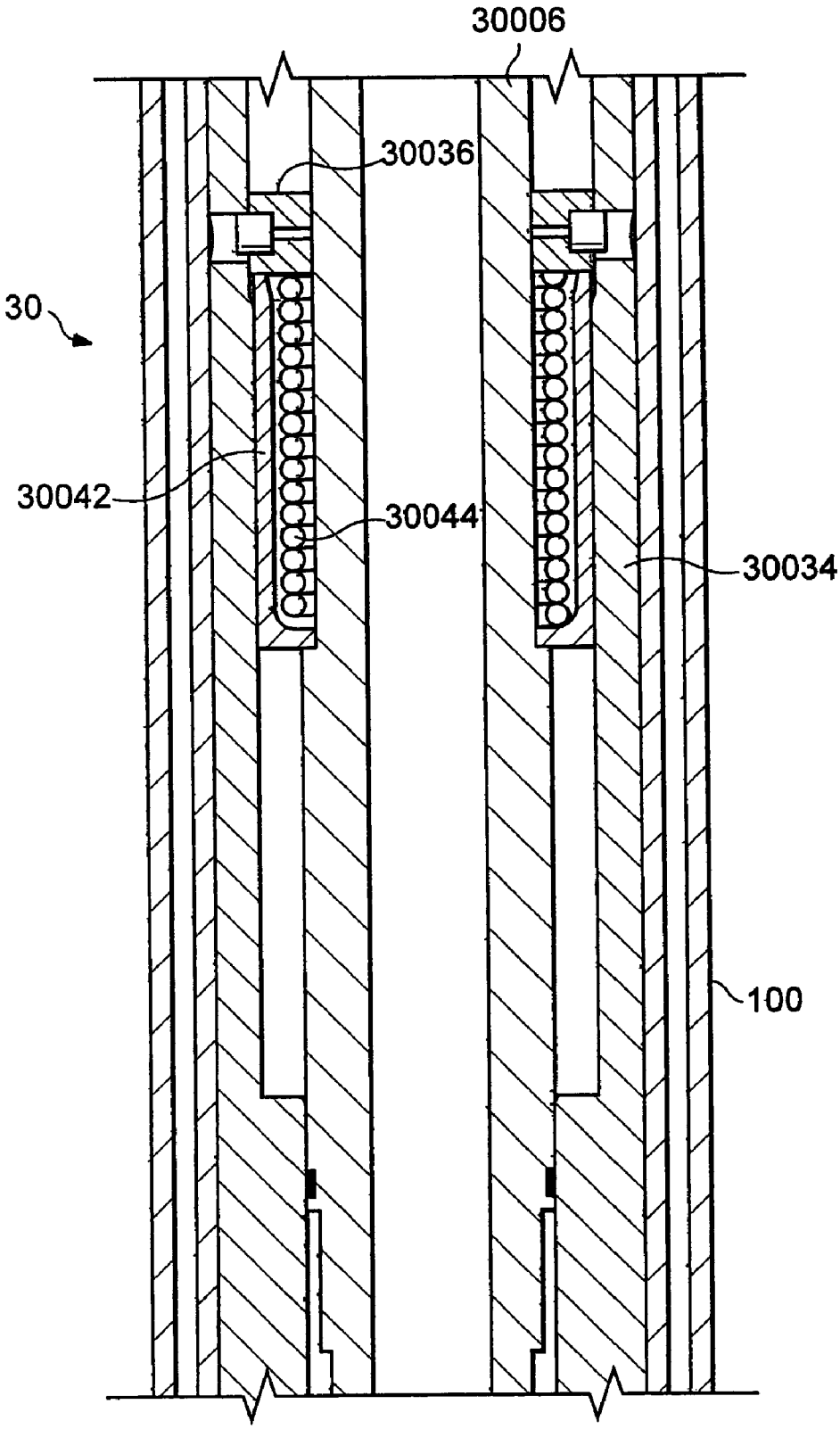
*Fig. 17Z2*

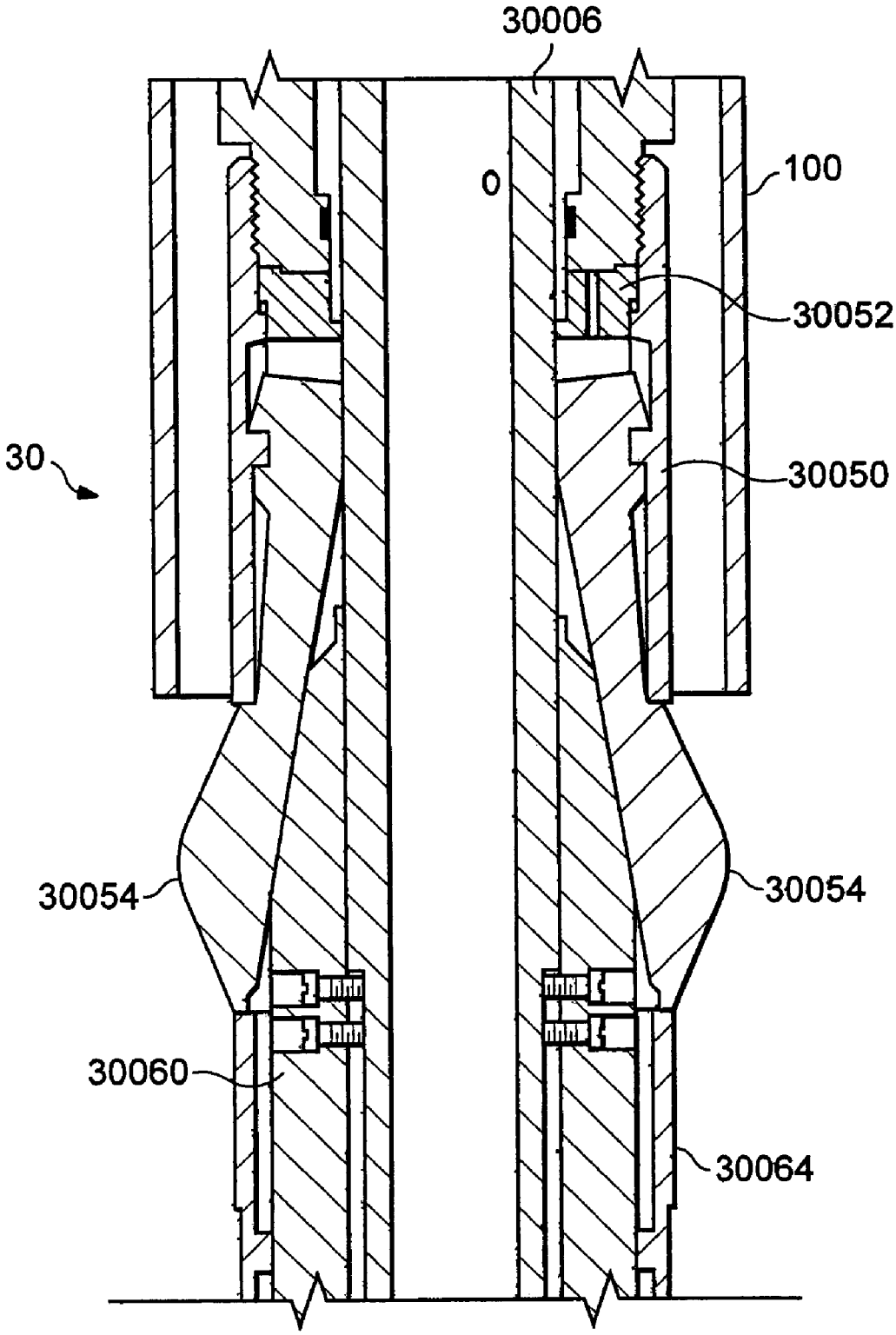
*Fig. 17Z3*

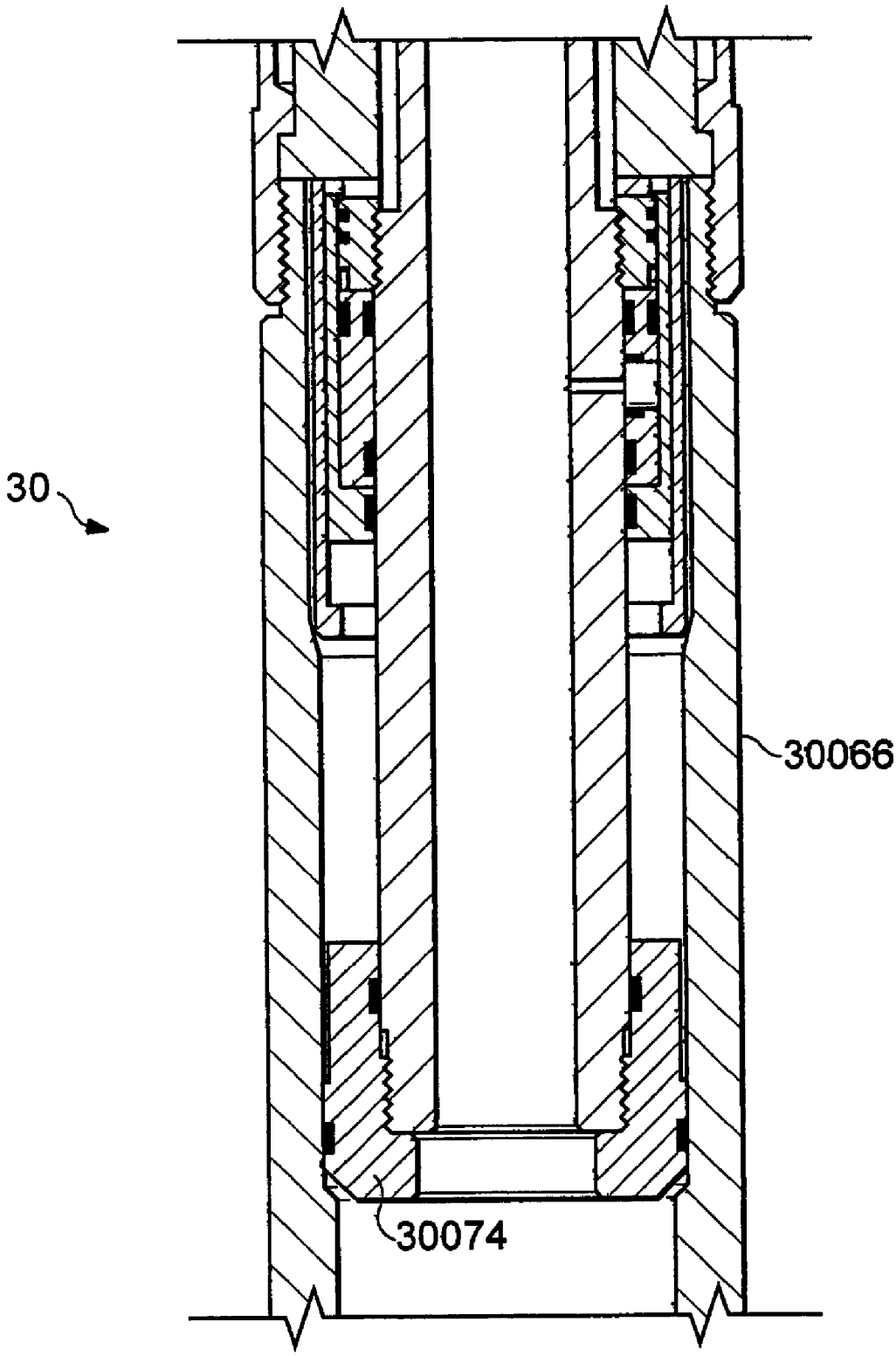
*Fig. 17Z4*

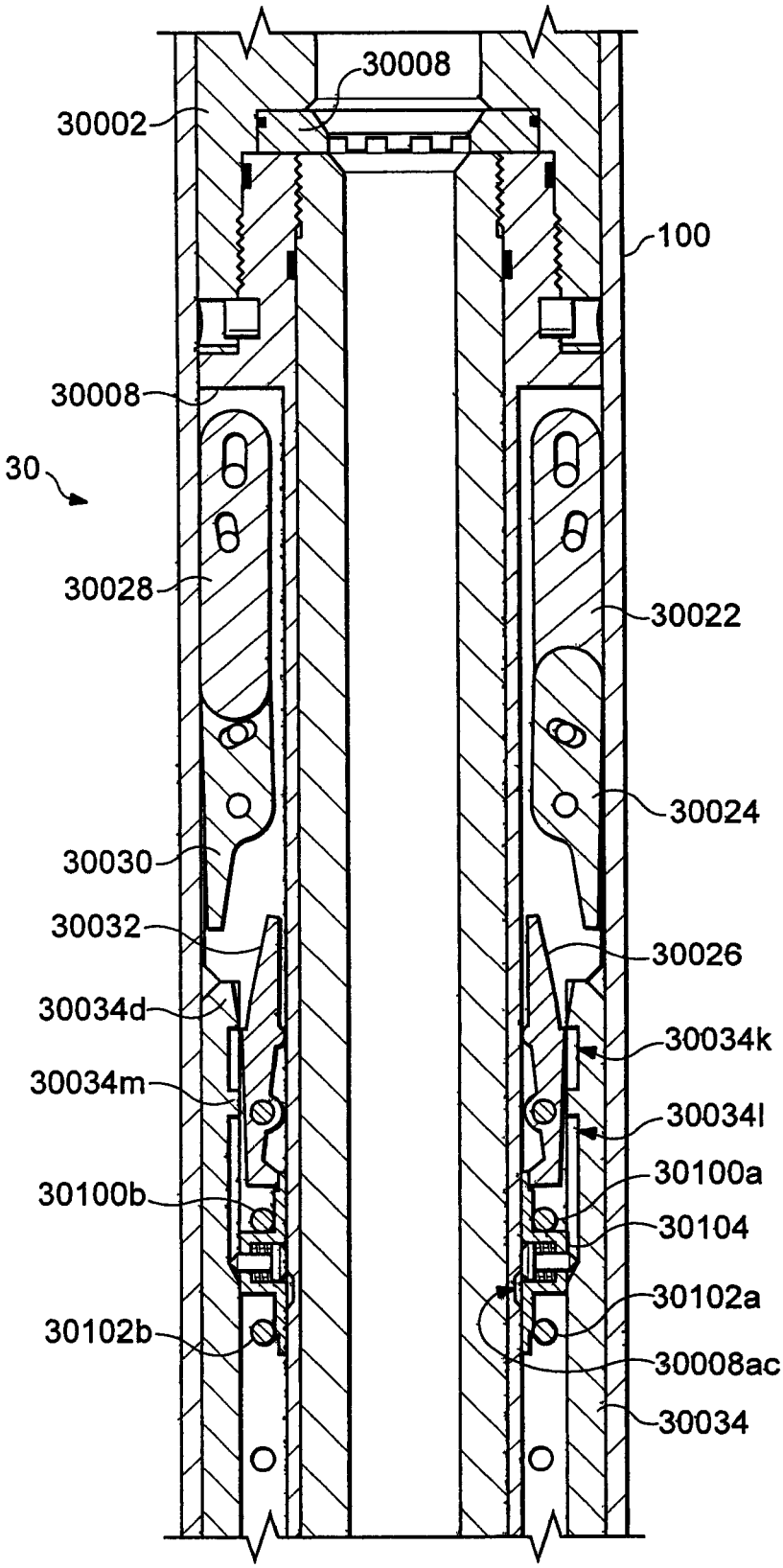
*Fig. 17AA1*

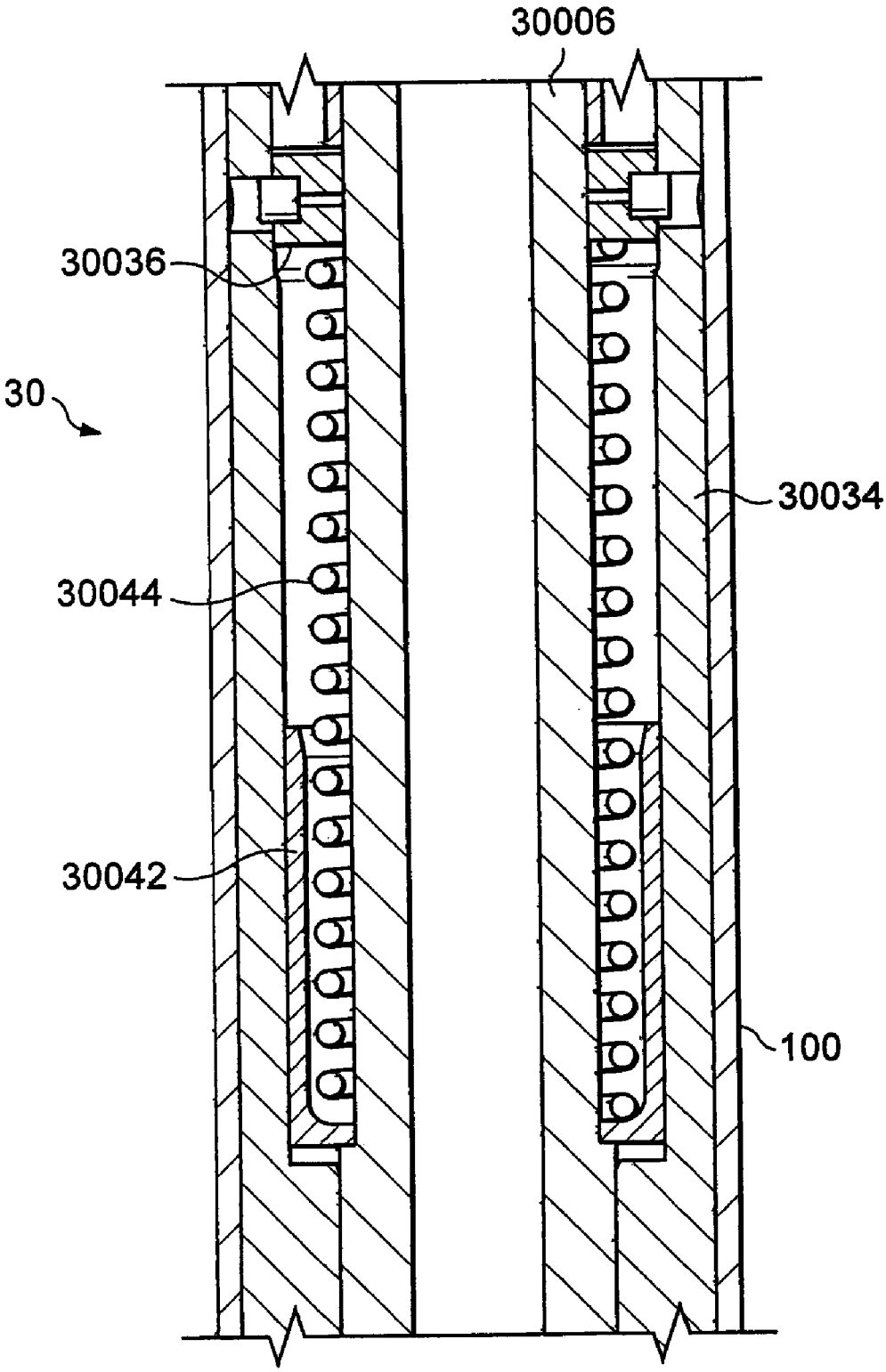
*Fig. 17AA2*

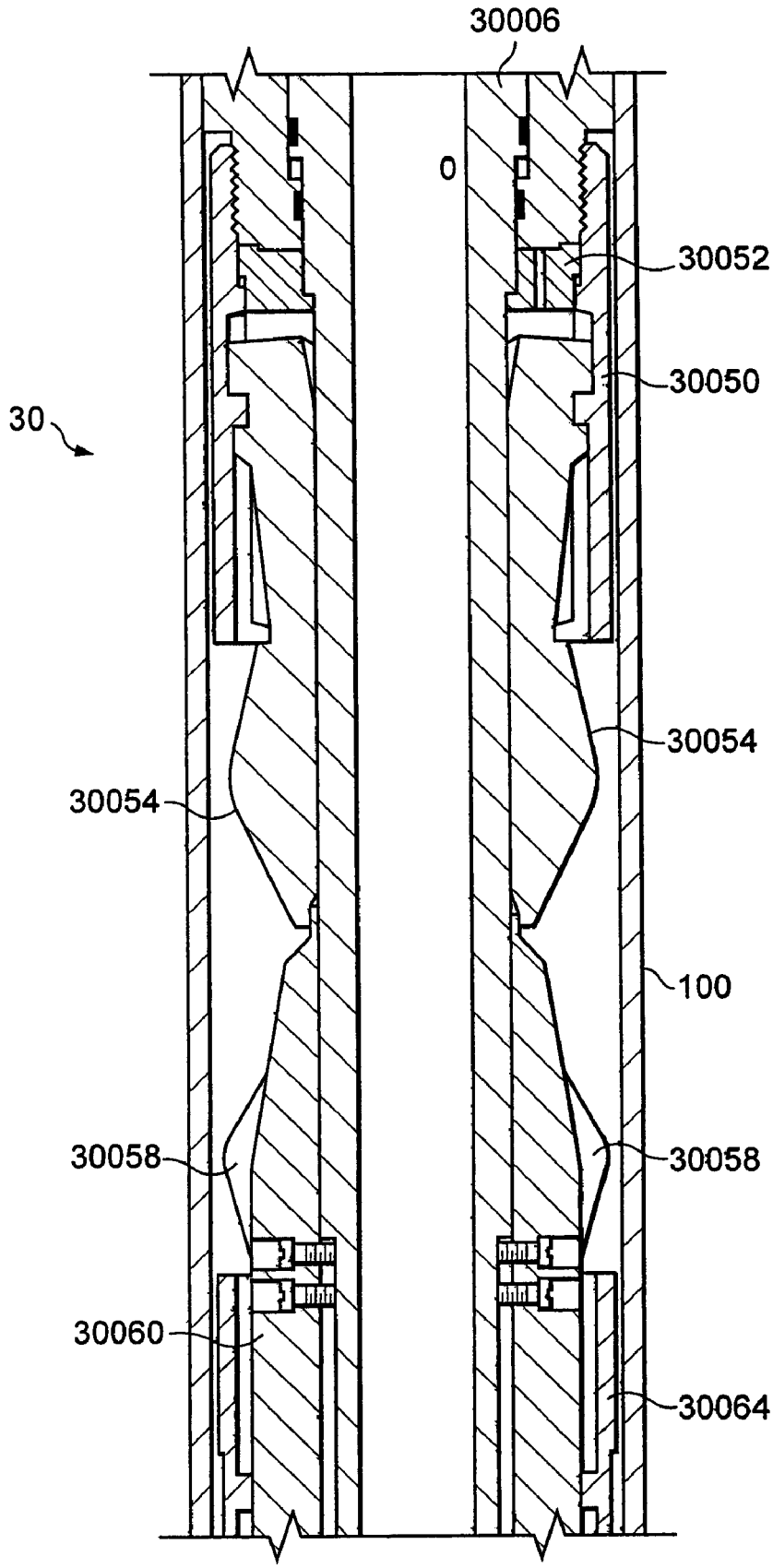
*Fig. 17AA3*

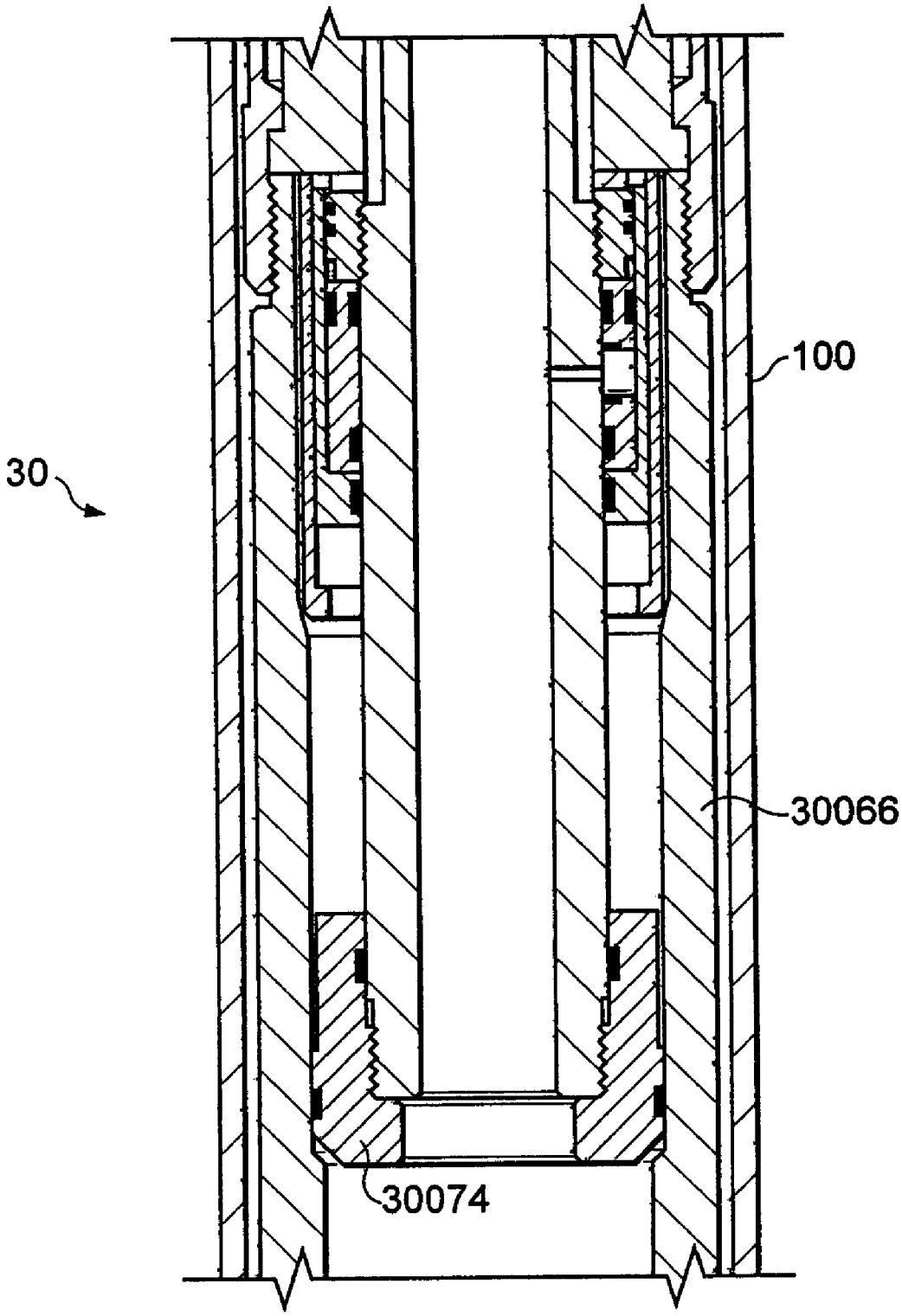
*Fig. 17AA4*

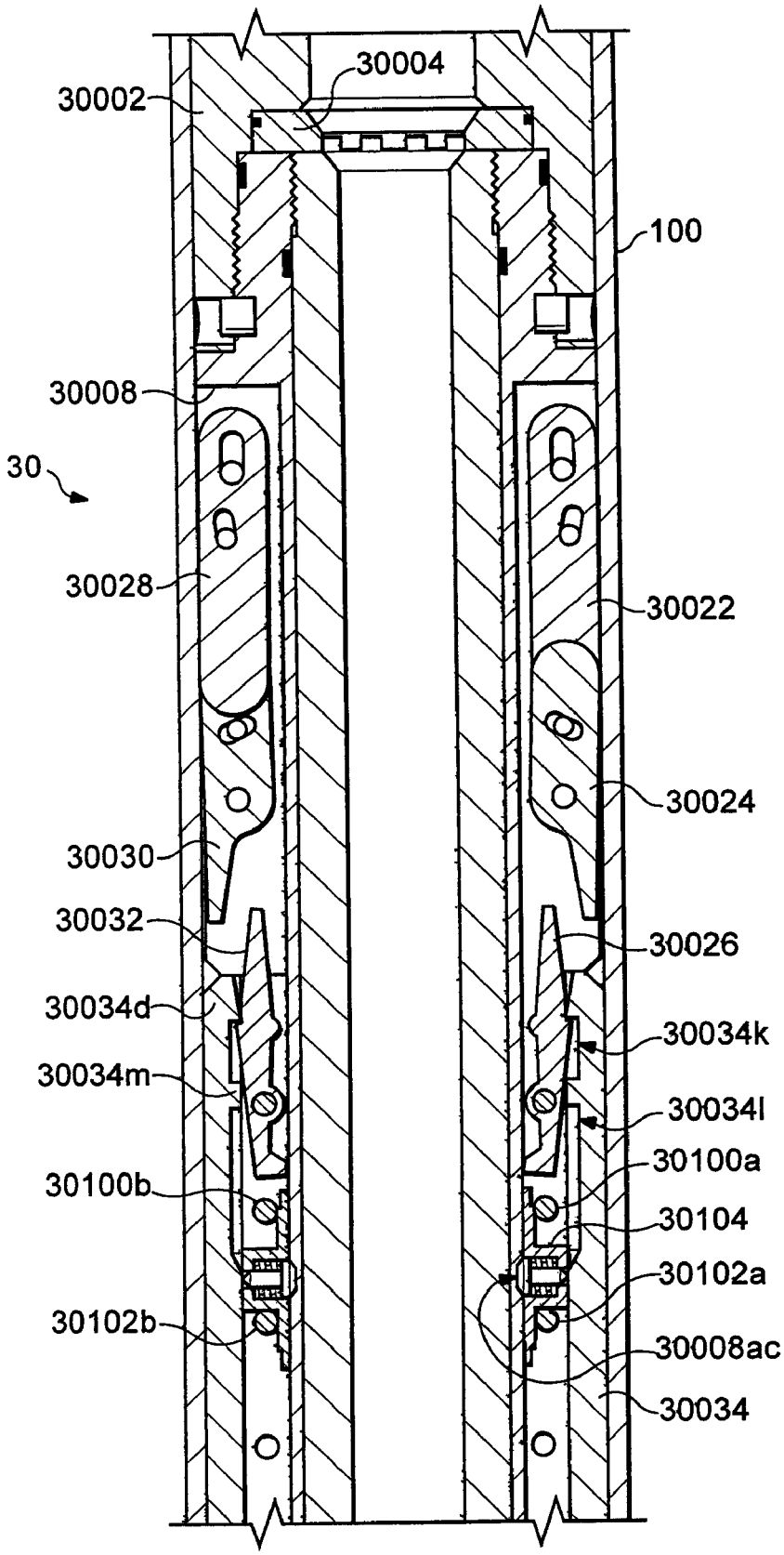
*Fig. 17AB1*

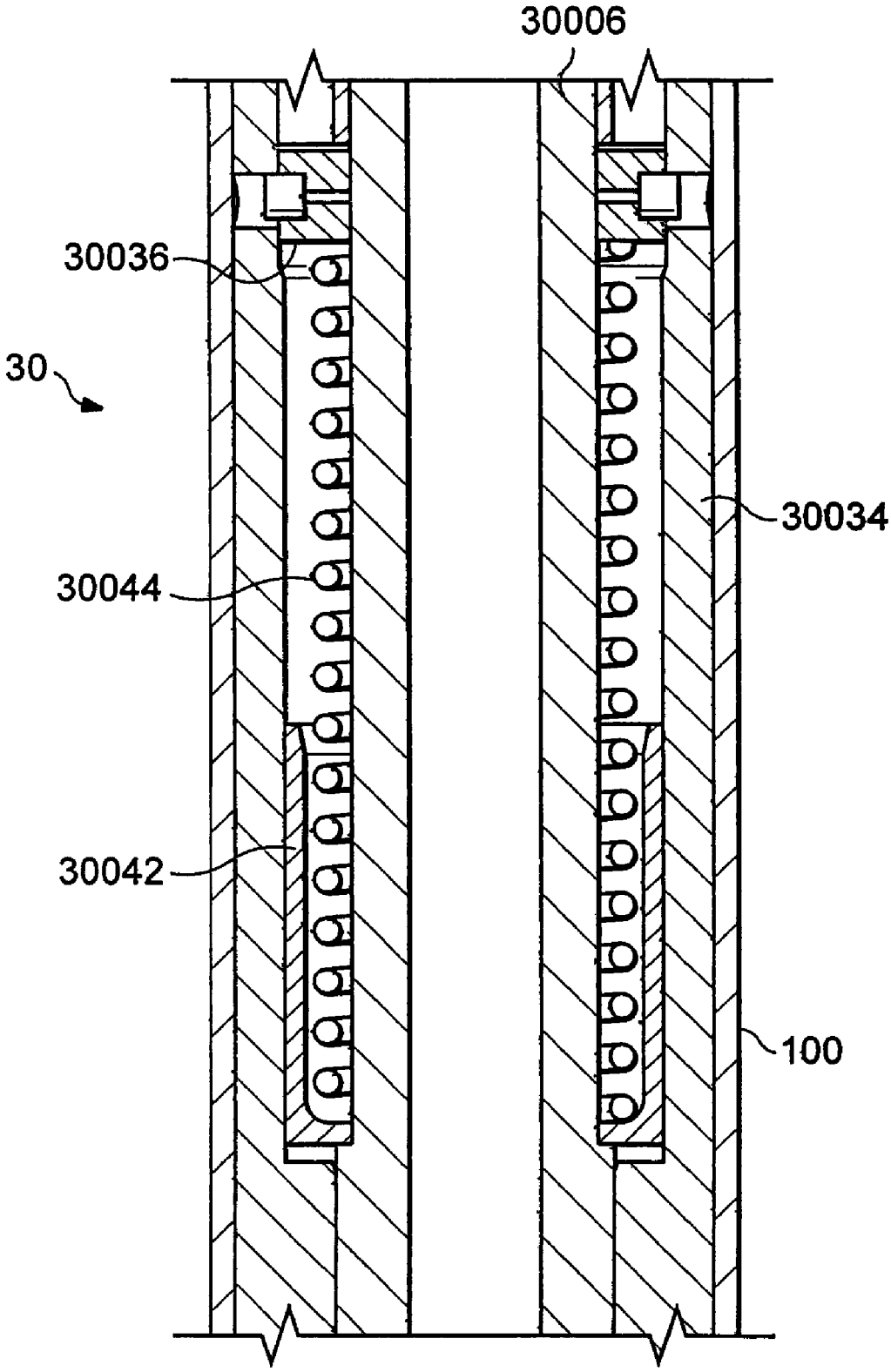
*Fig. 17AB2*

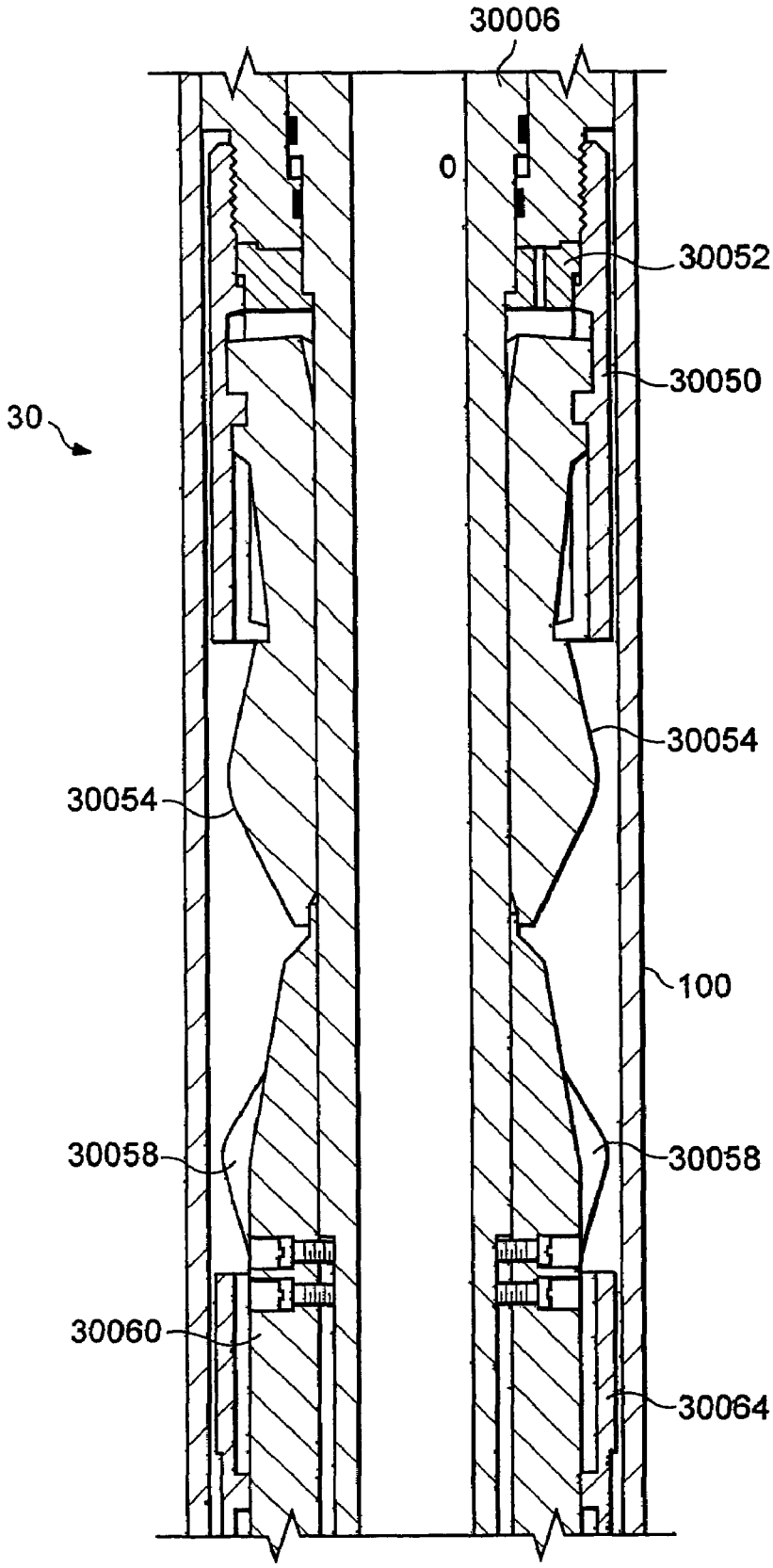
*Fig. 17AB3*

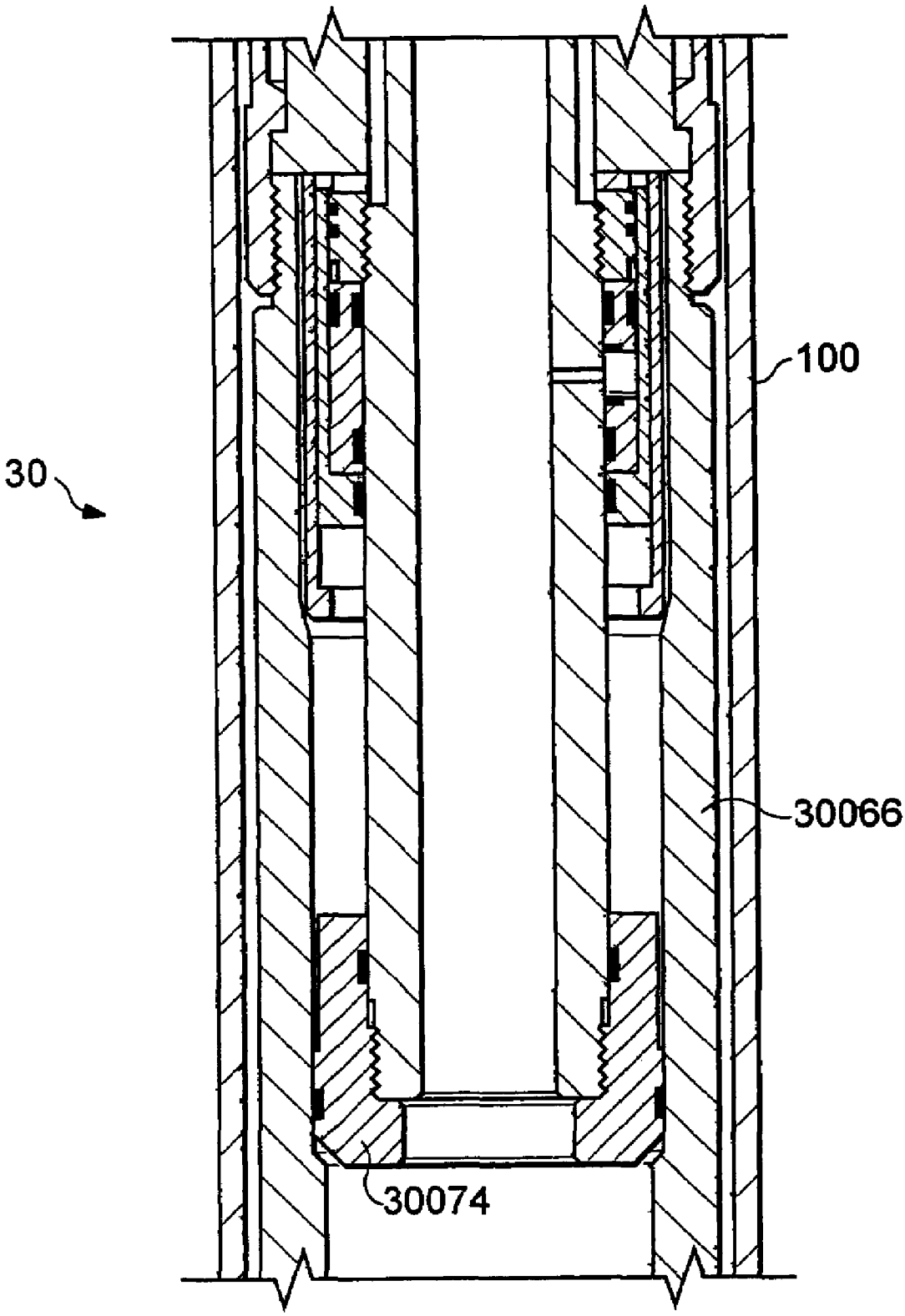
*Fig. 17AB4*

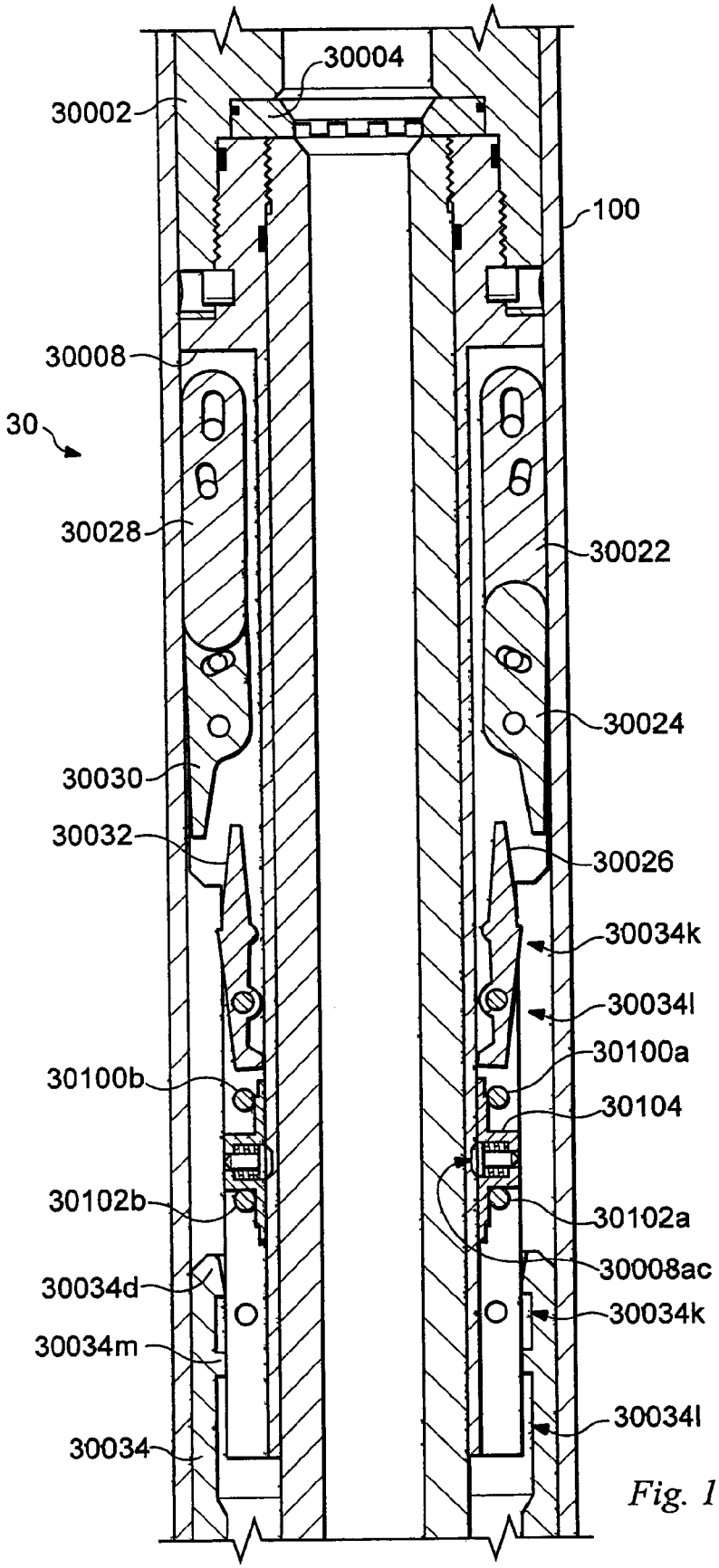
*Fig. 17AC1*

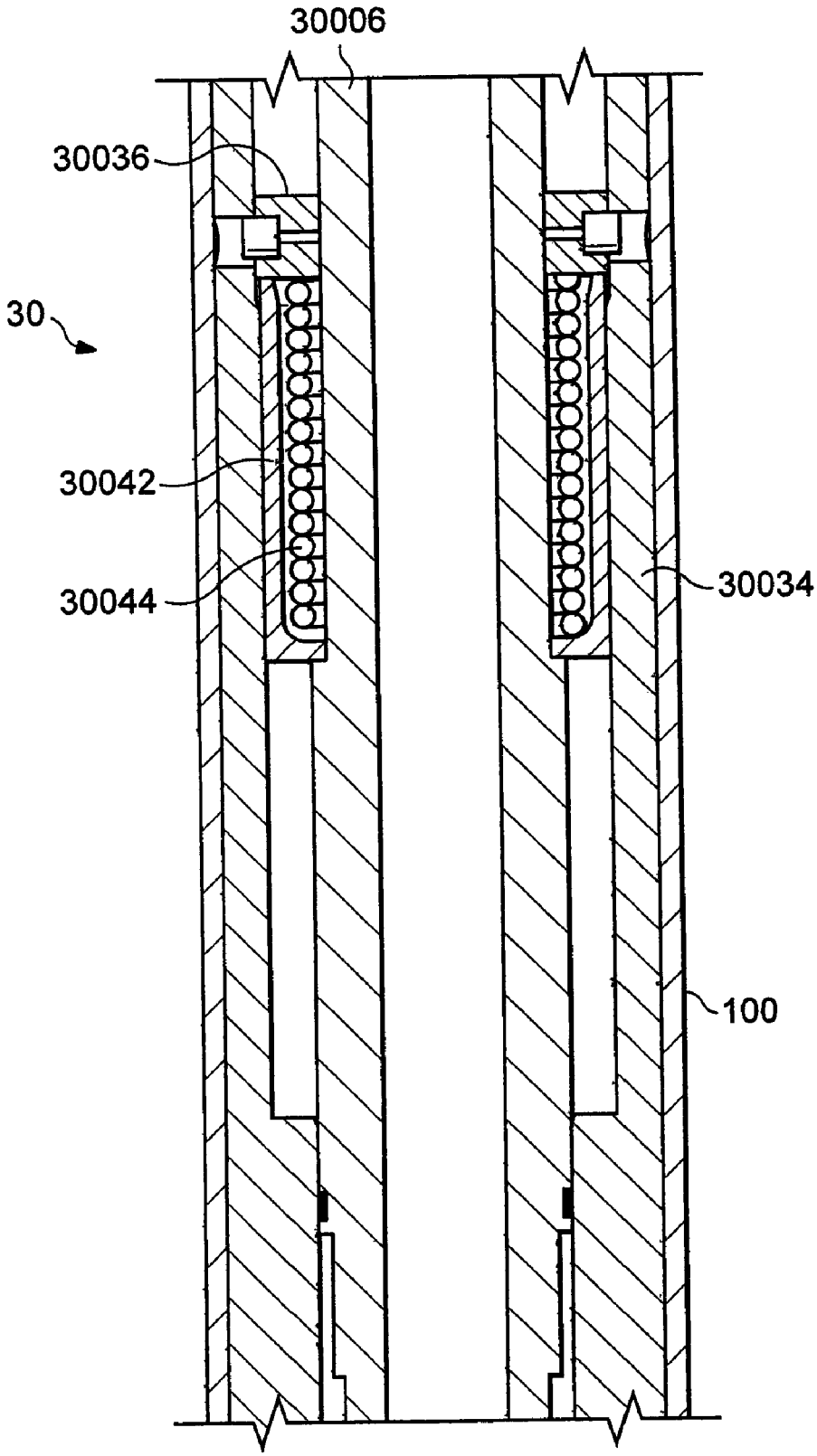
*Fig. 17AC2*

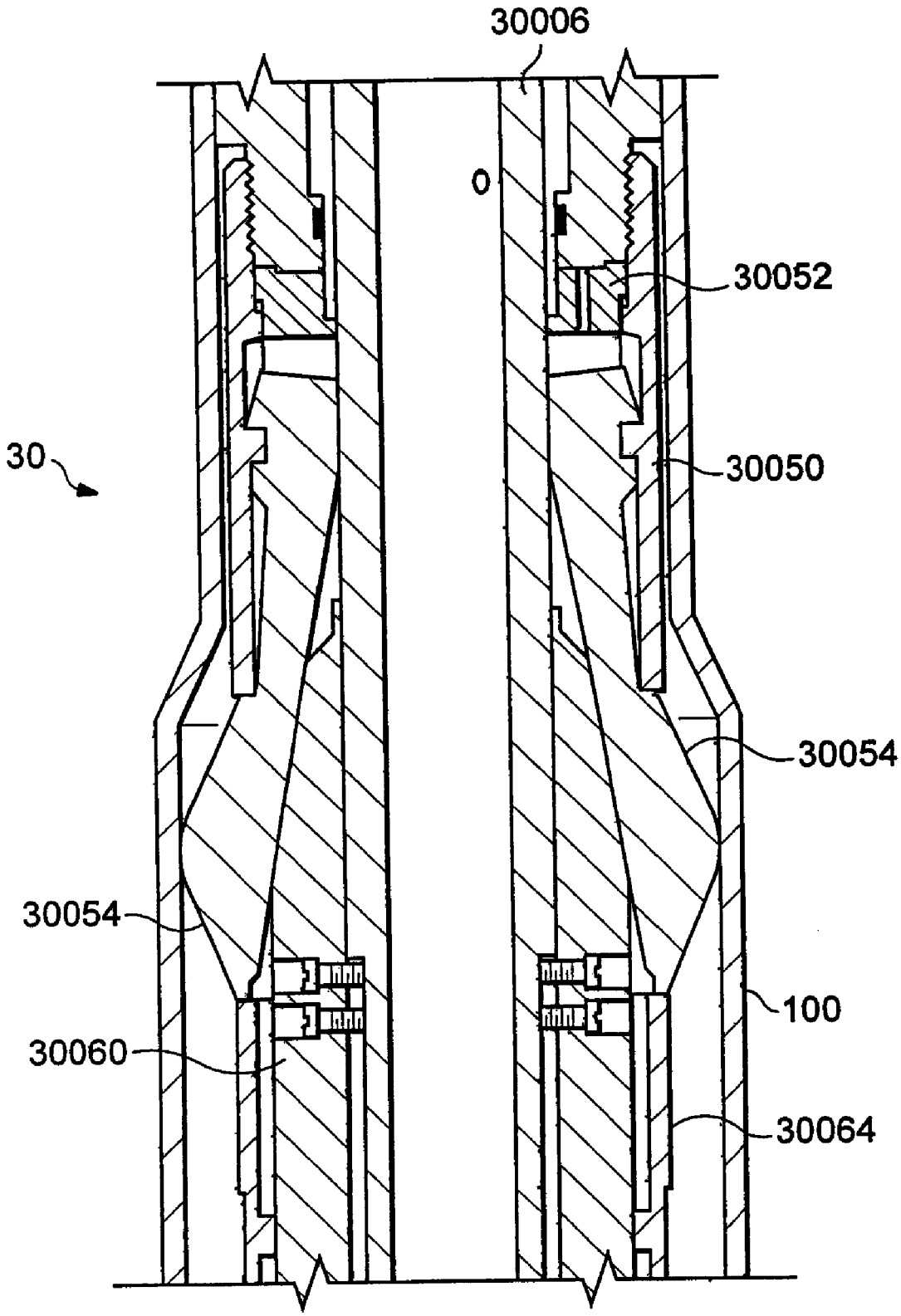
*Fig. 17AC3*

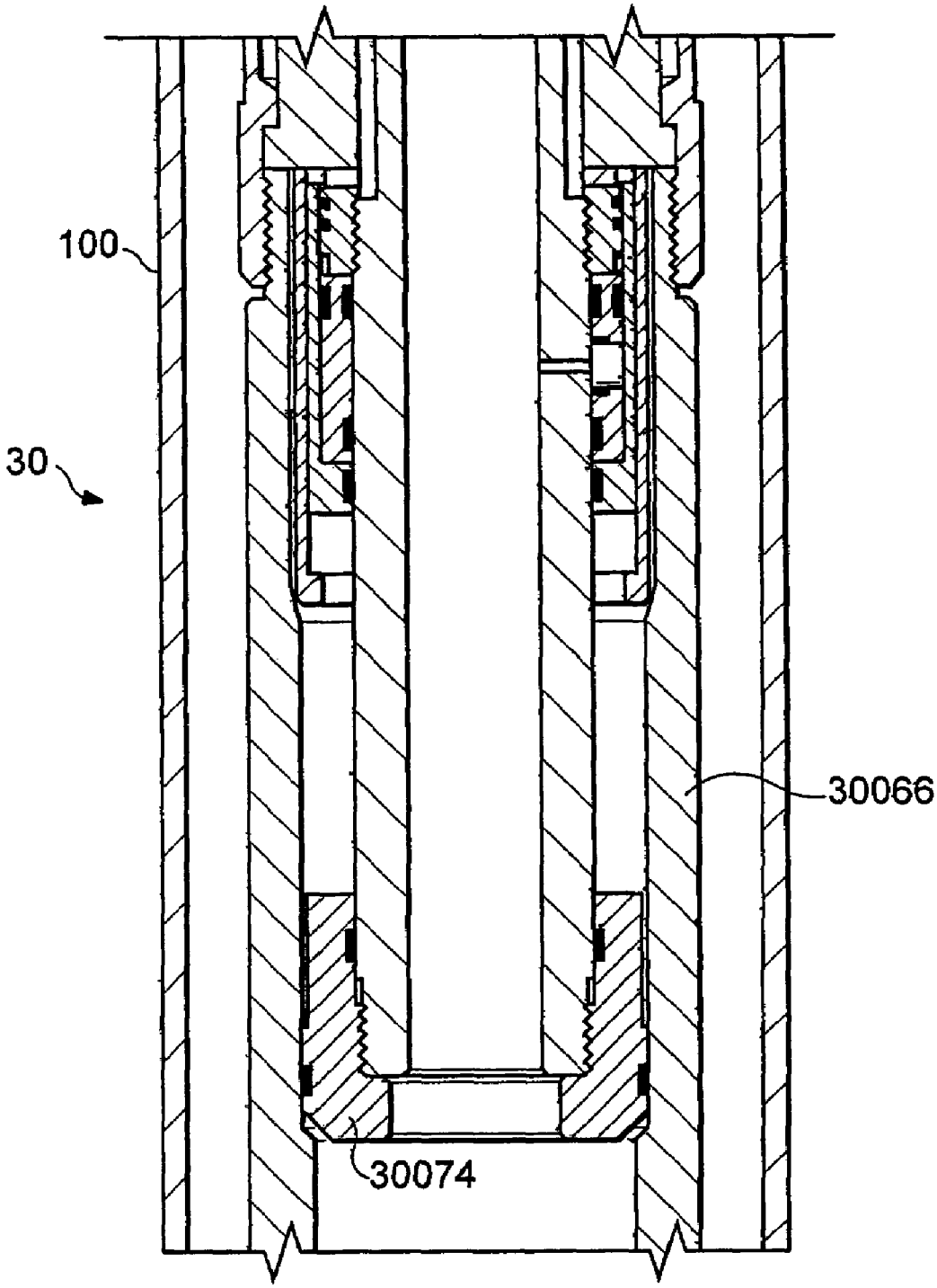
*Fig. 17AC4*

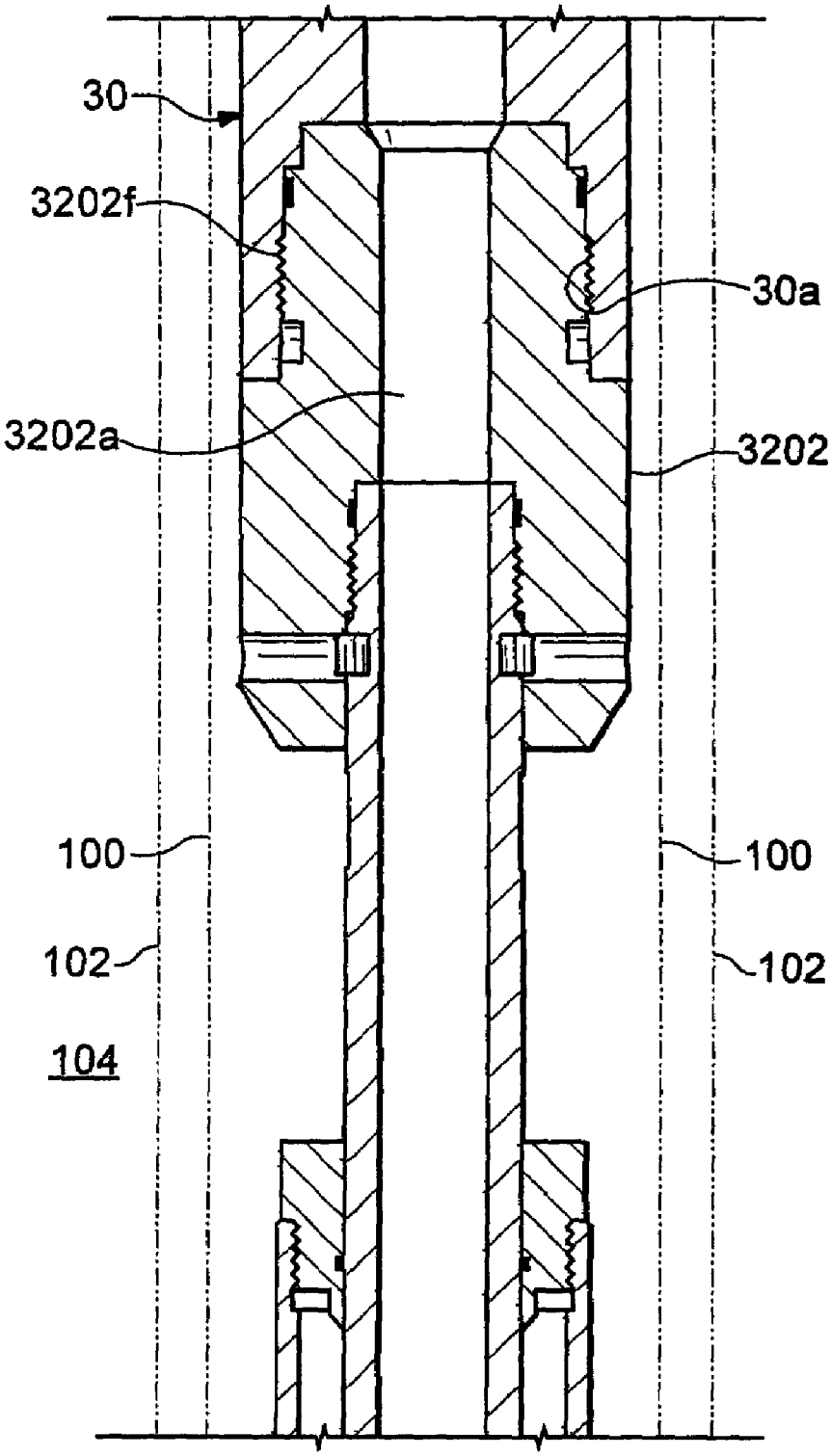
*Fig. 20A1*

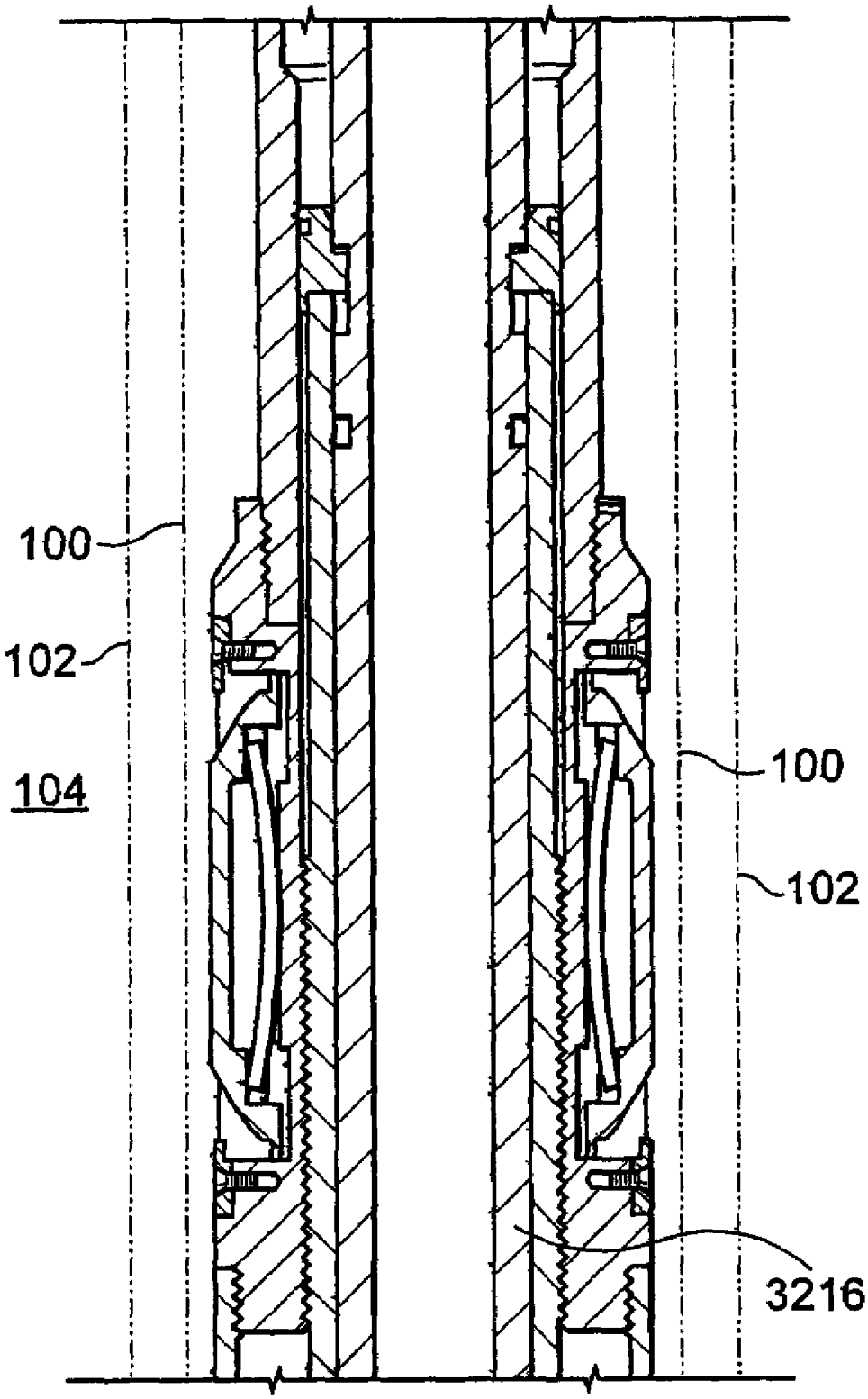
*Fig. 20A2*

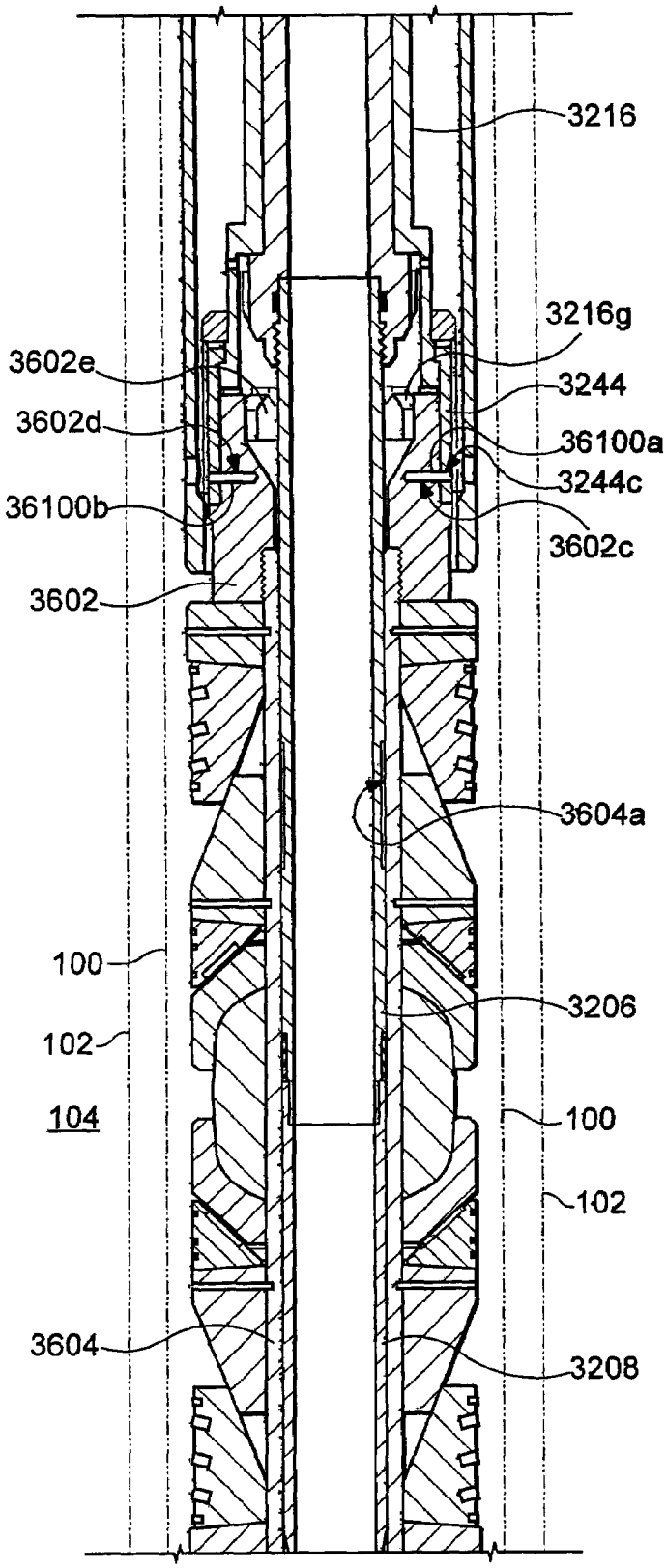
*Fig. 20A3*

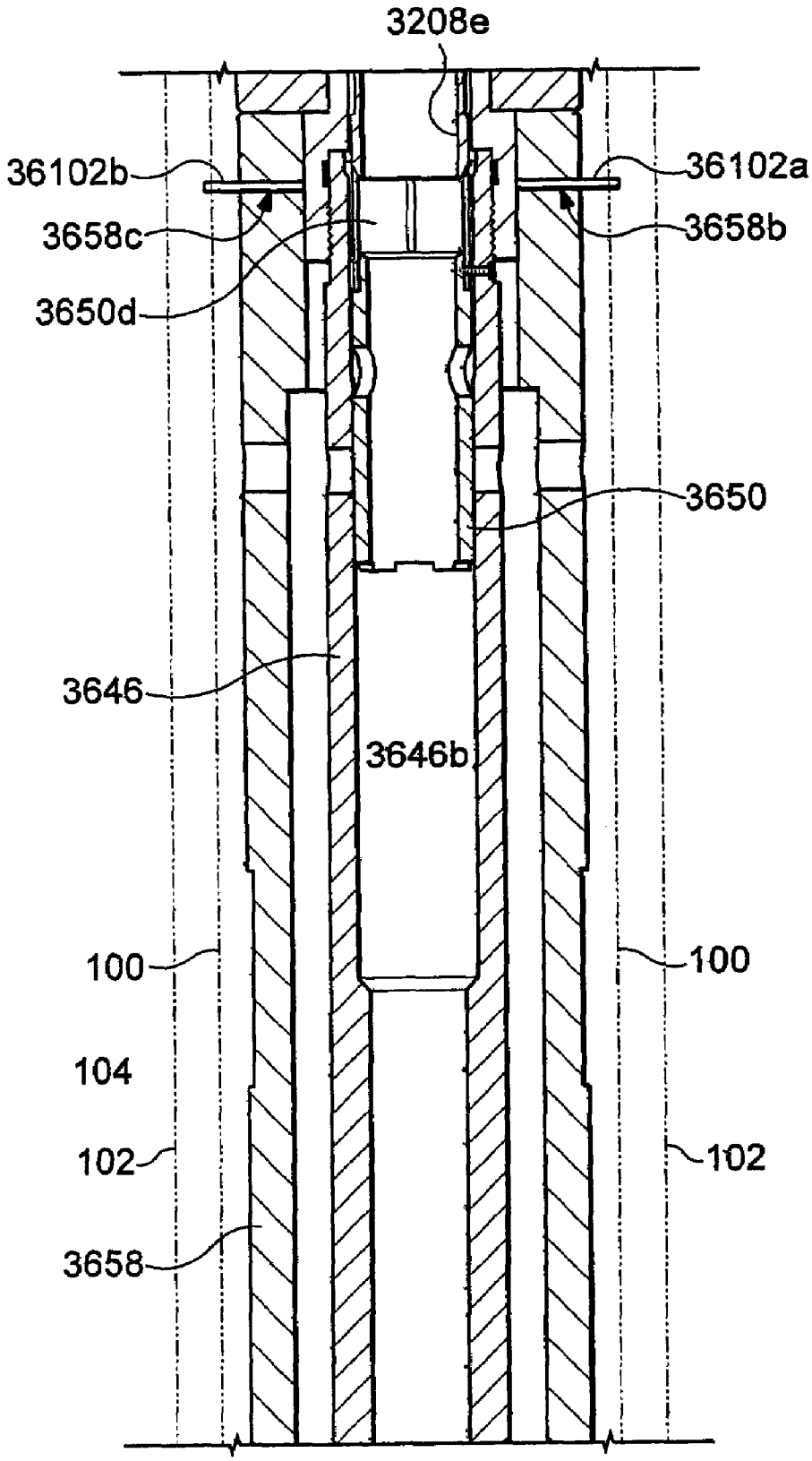
*Fig. 20A4*

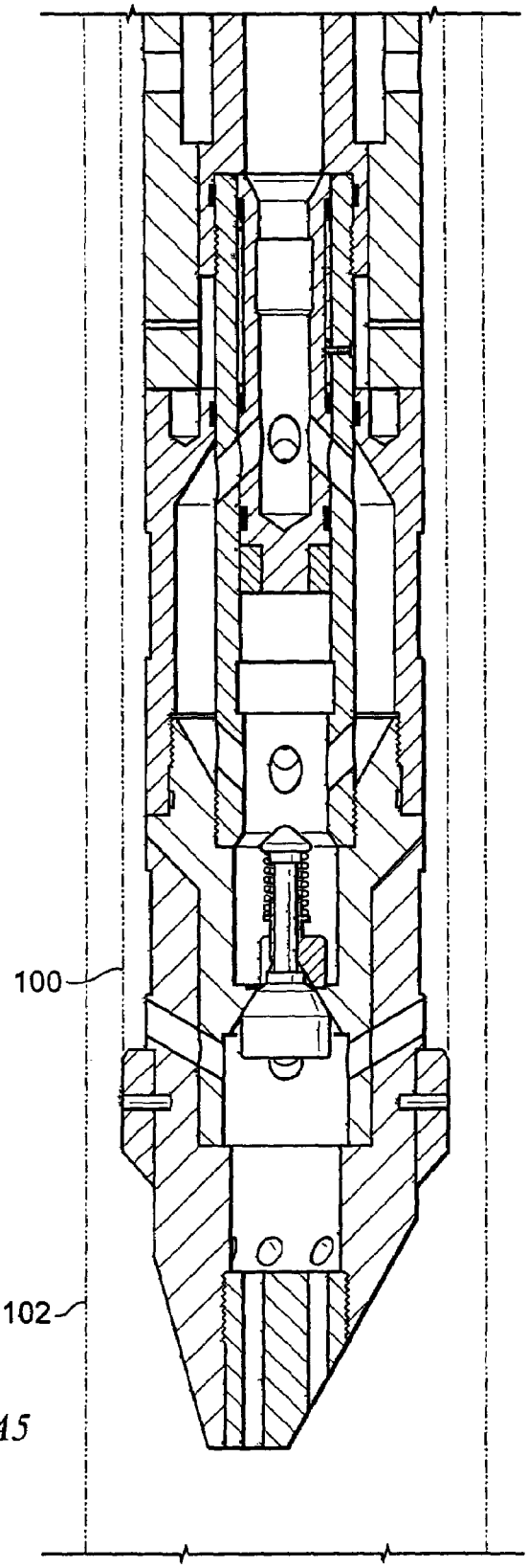
*Fig. 20A5*

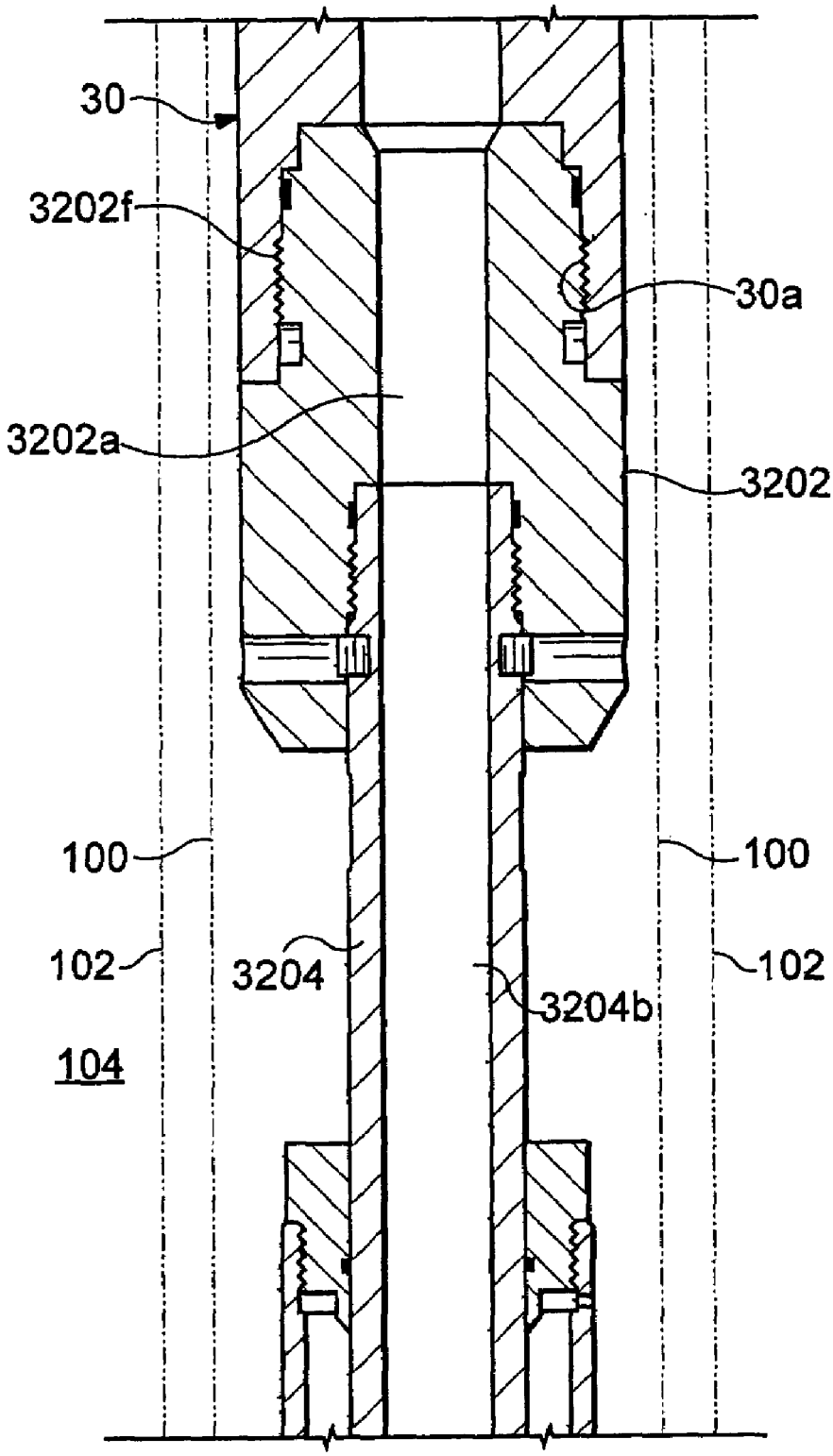
*Fig. 20B1*

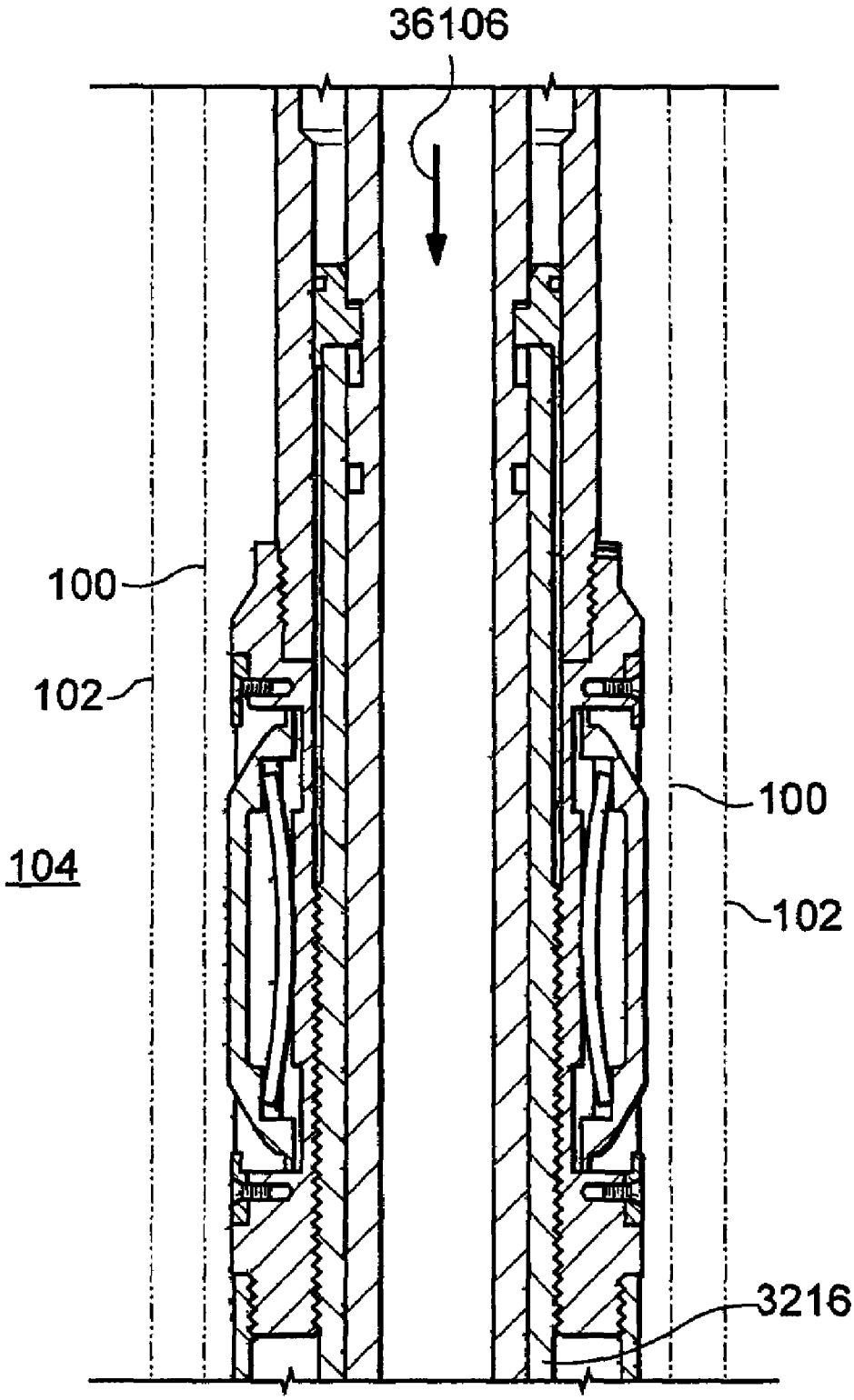
*Fig. 20B2*

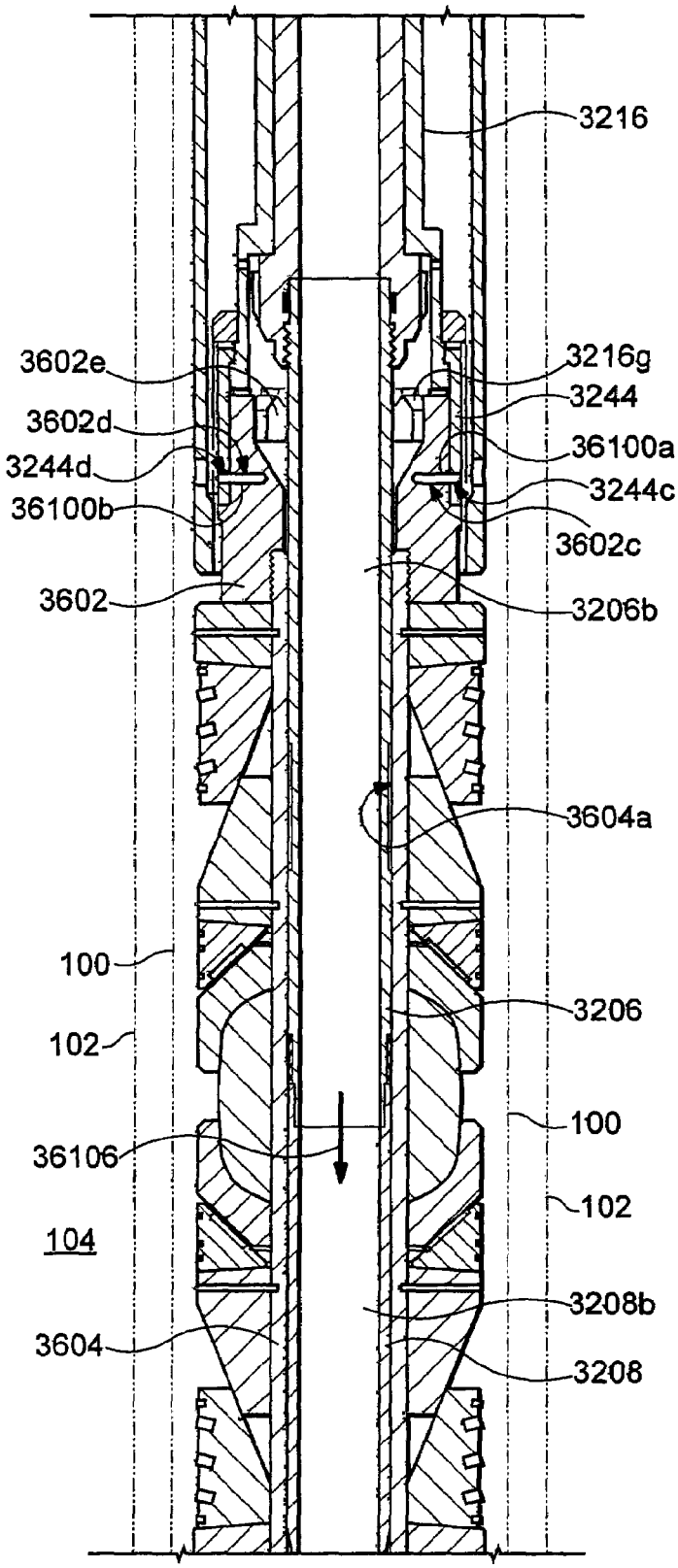
*Fig. 20B3*

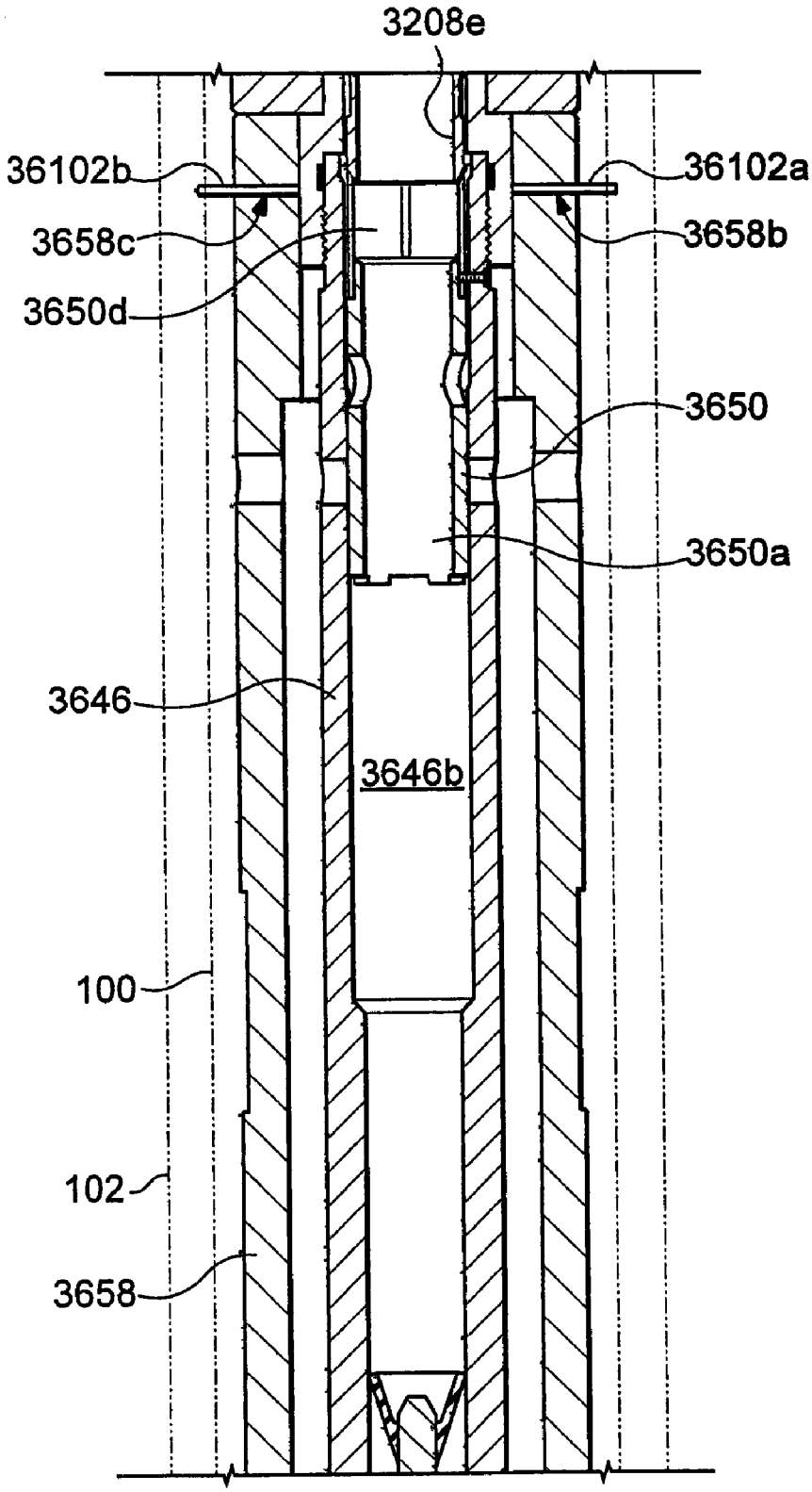
*Fig. 20B4*

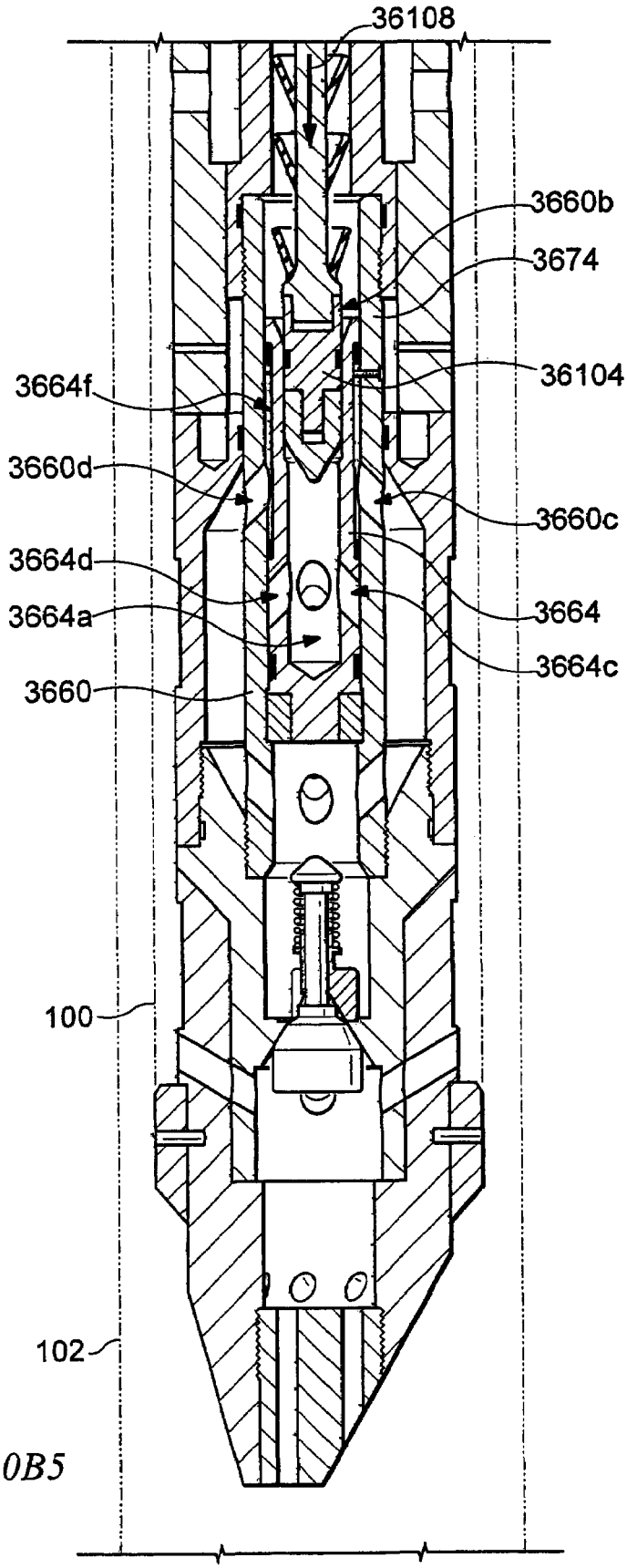
*Fig. 20B5*

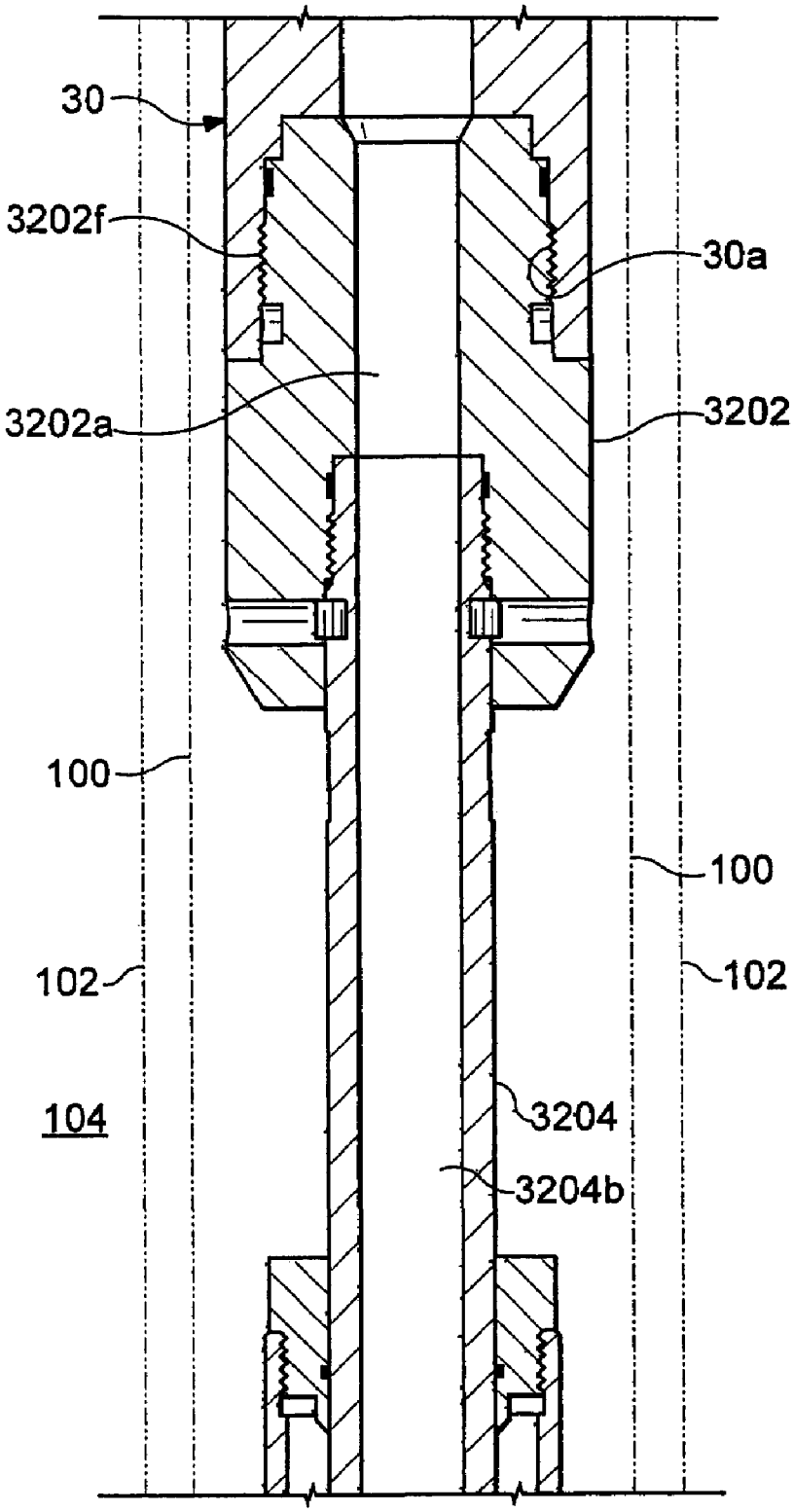
*Fig. 20C1*

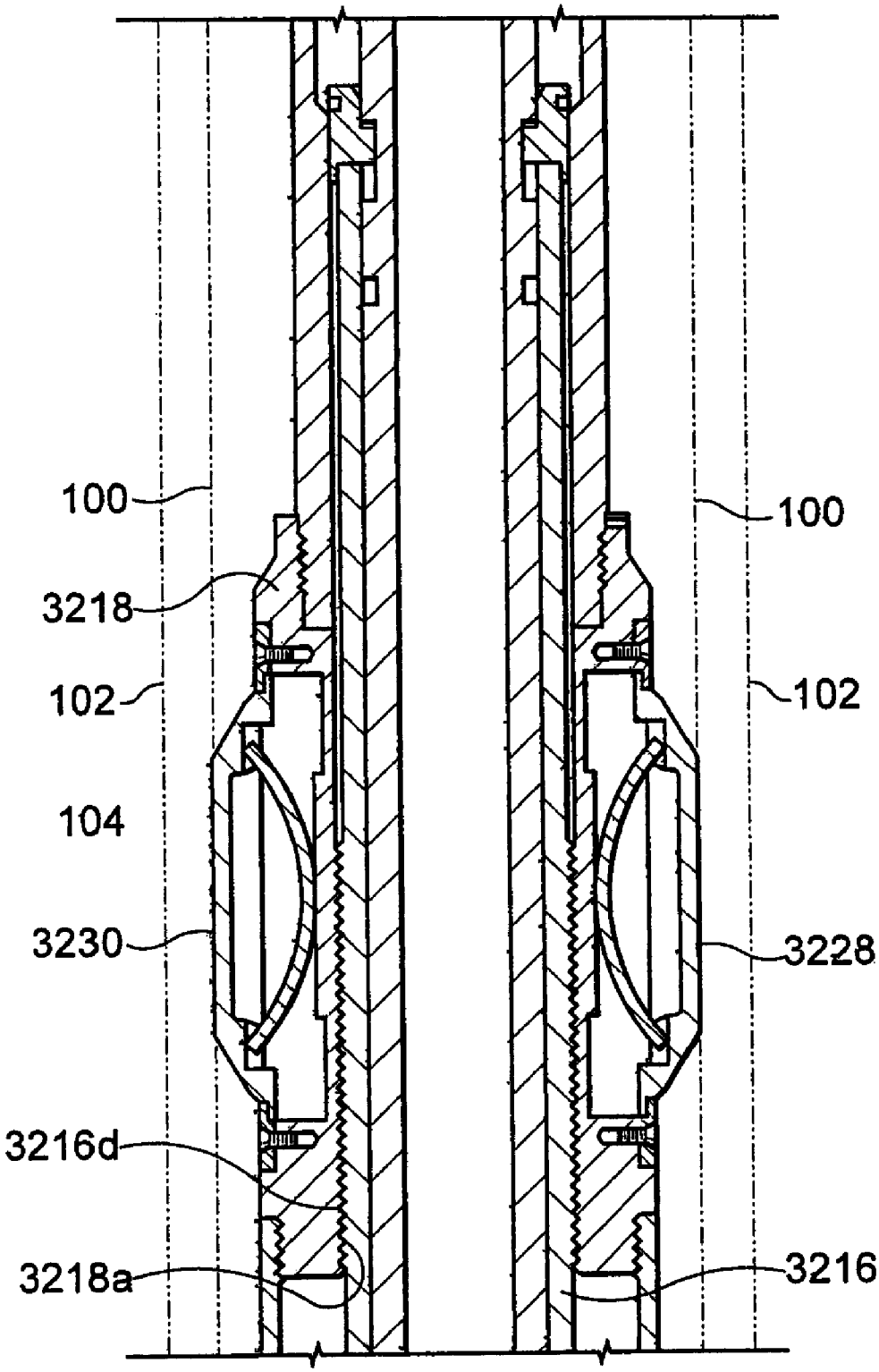
*Fig. 20C2*

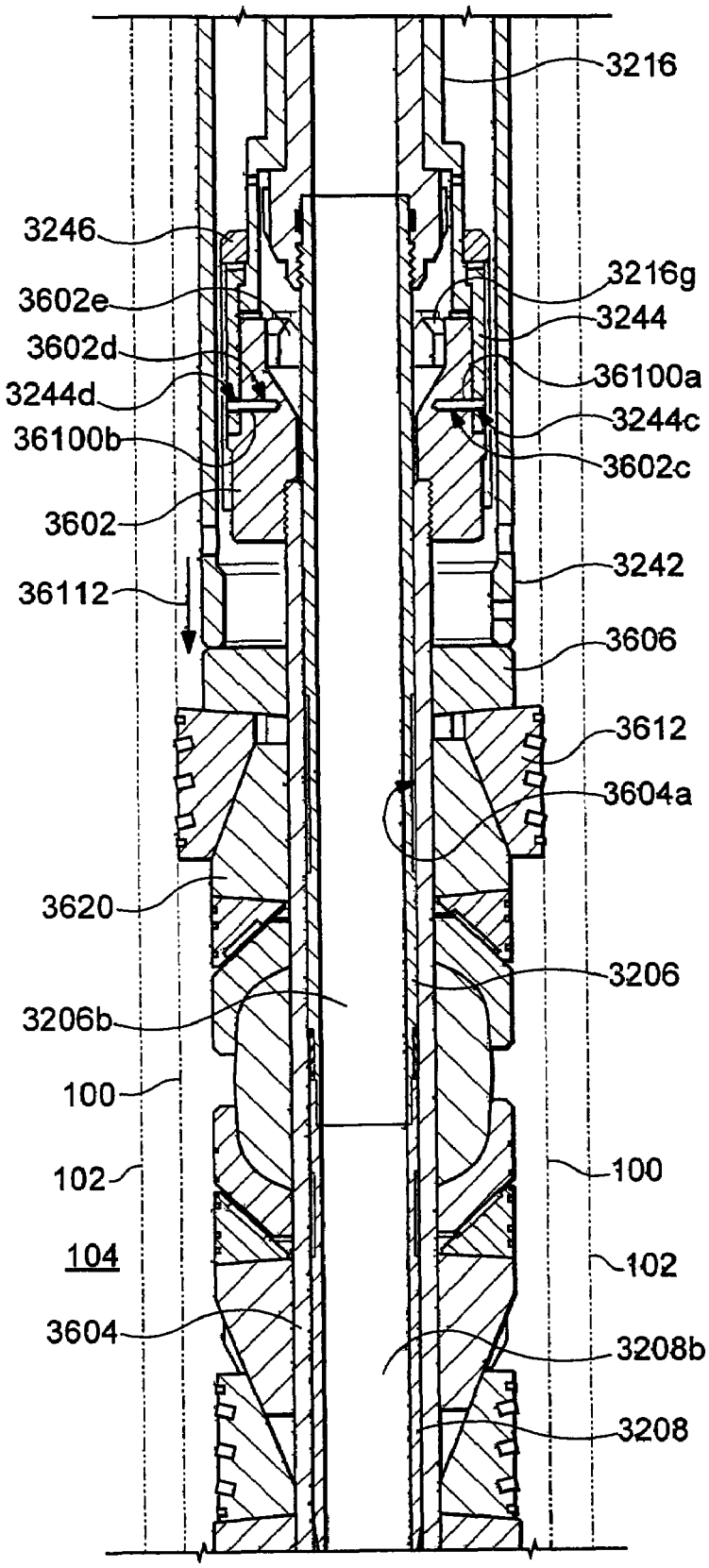
*Fig. 20C3*

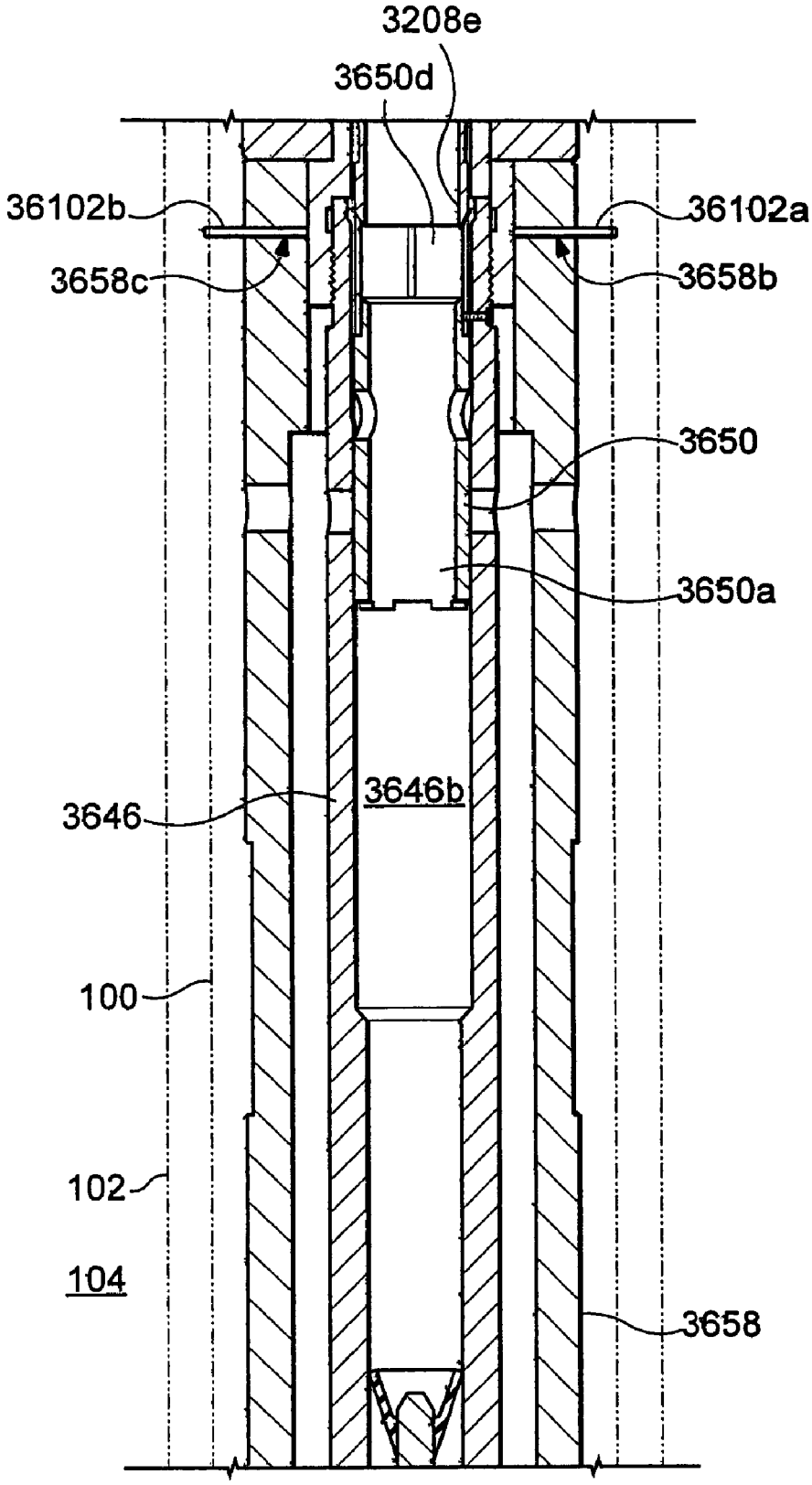
*Fig. 20C4*

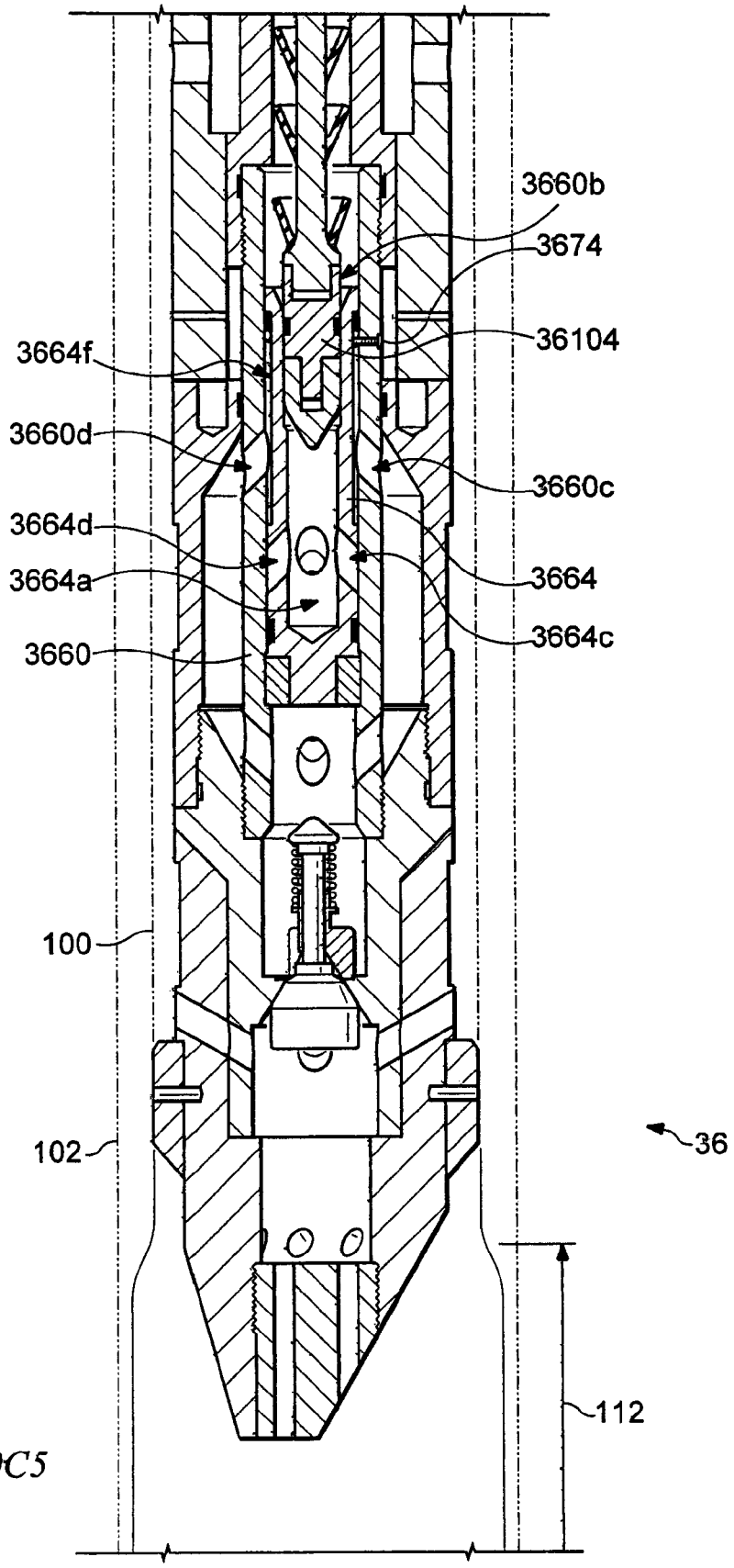
*Fig. 20C5*

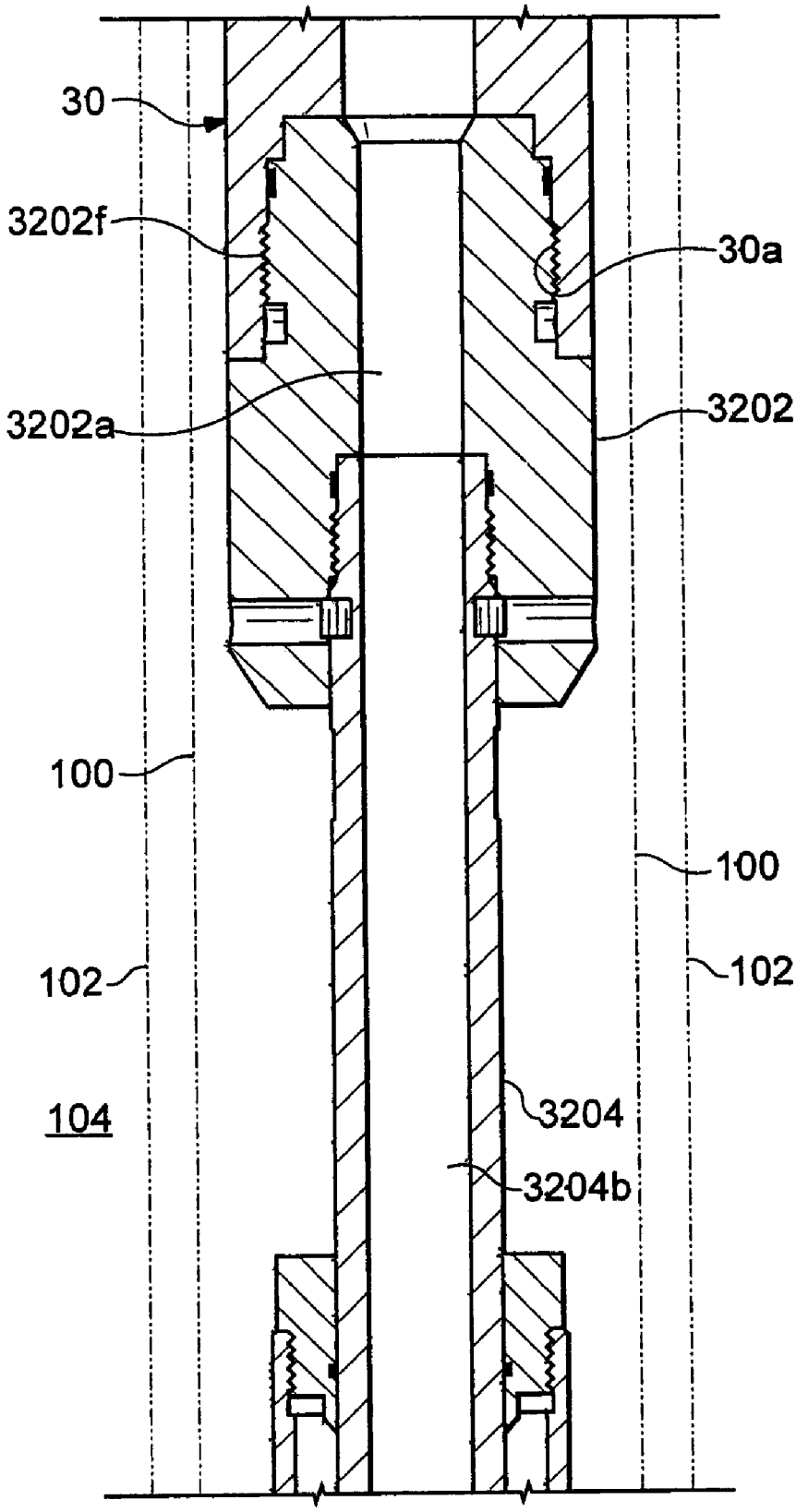
*Fig. 20D1*

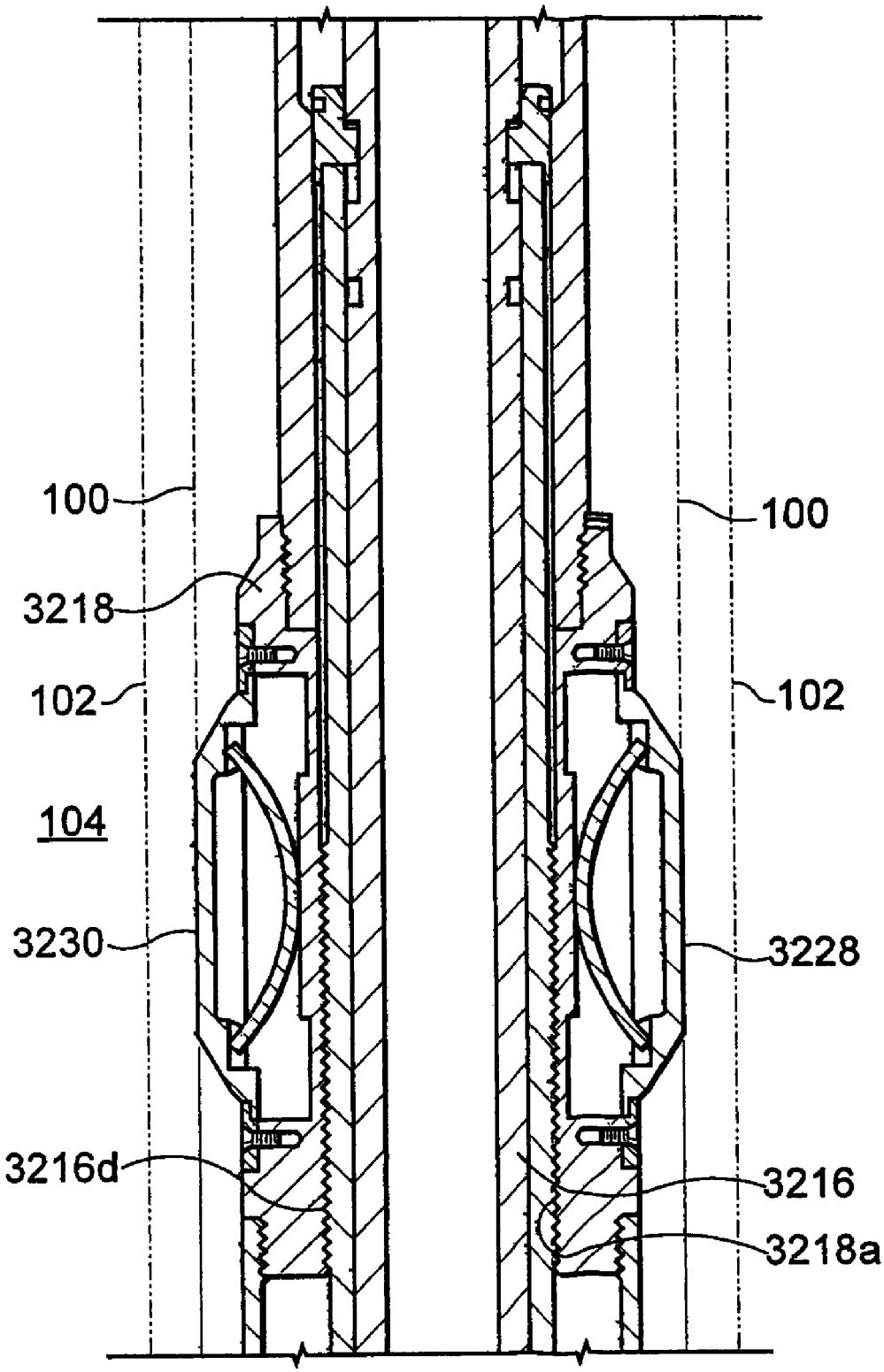
*Fig. 20D2*

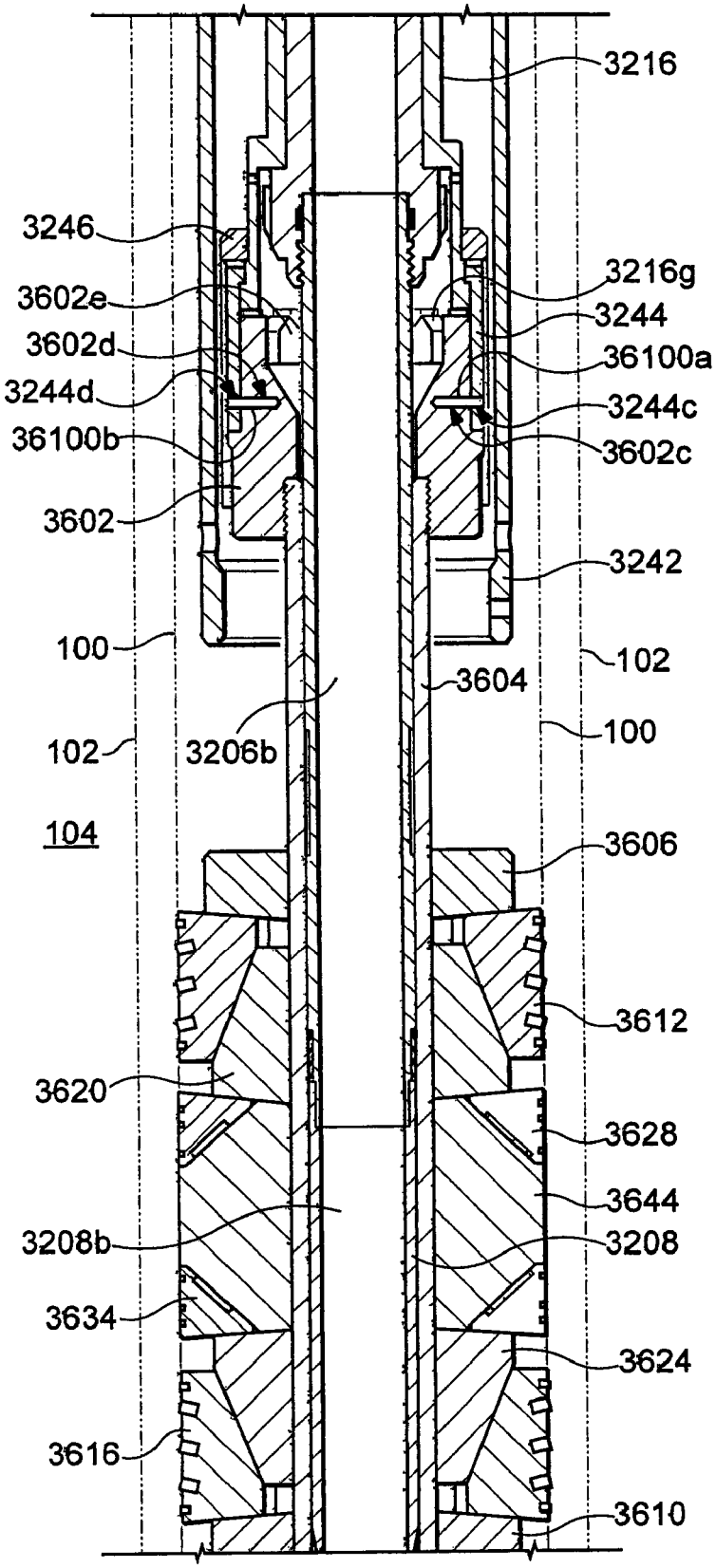
*Fig. 20D3*

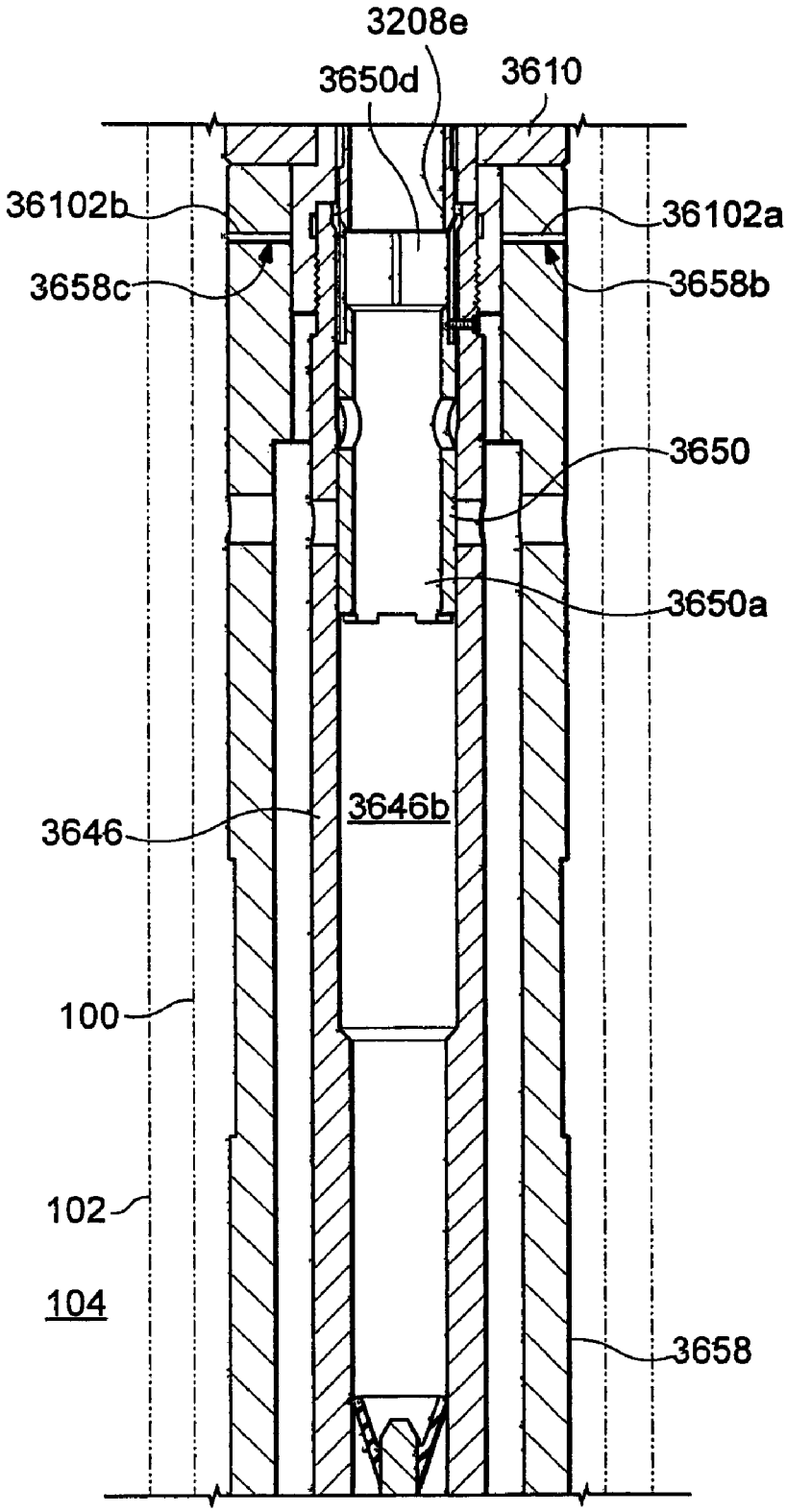
*Fig. 20D4*

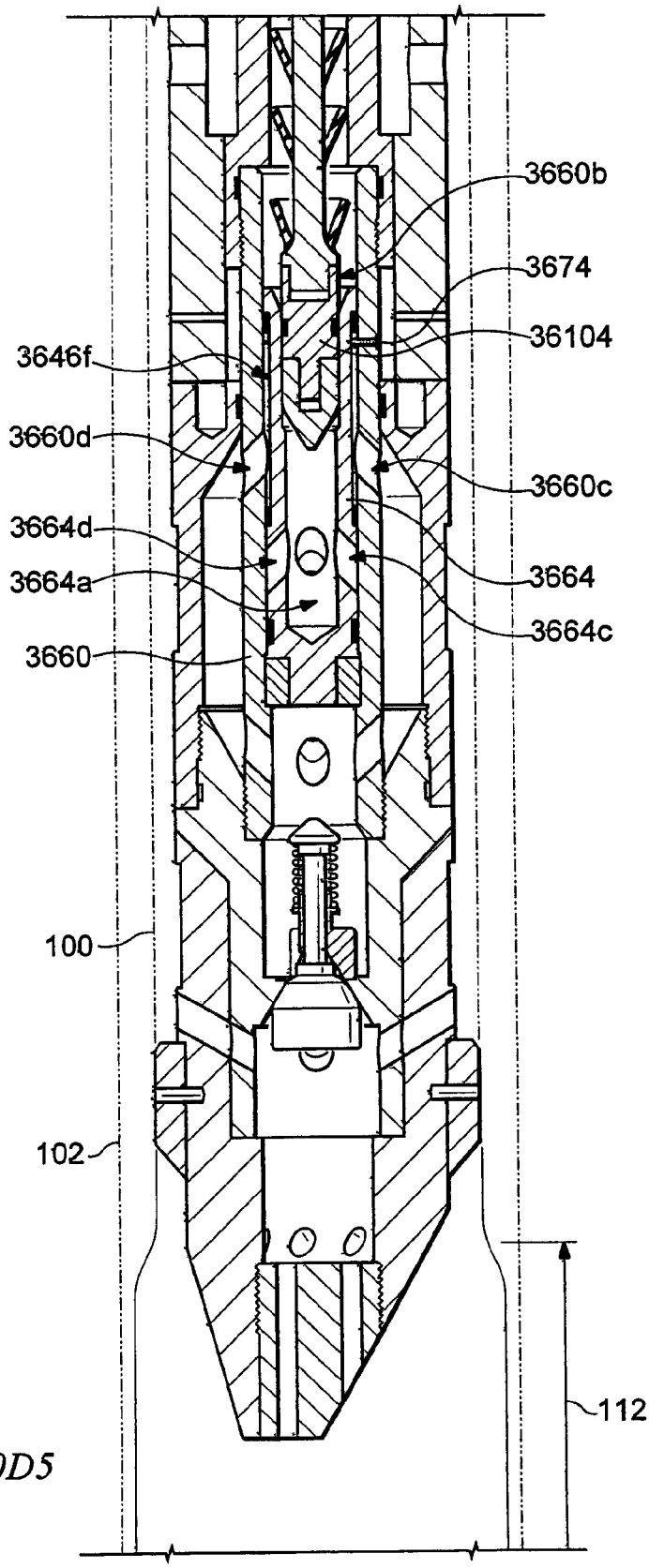
*Fig. 20D5*

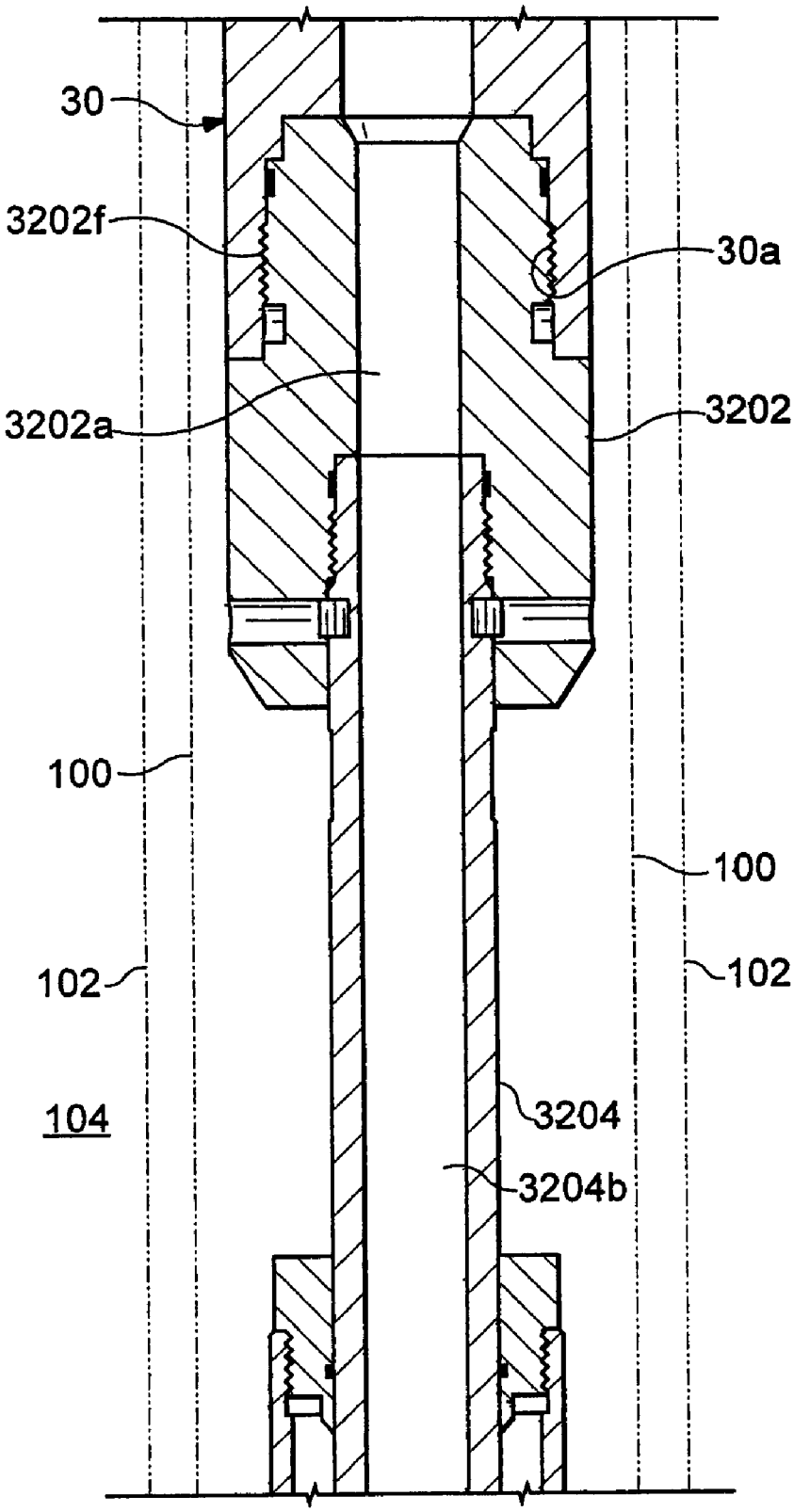
*Fig. 20E1*

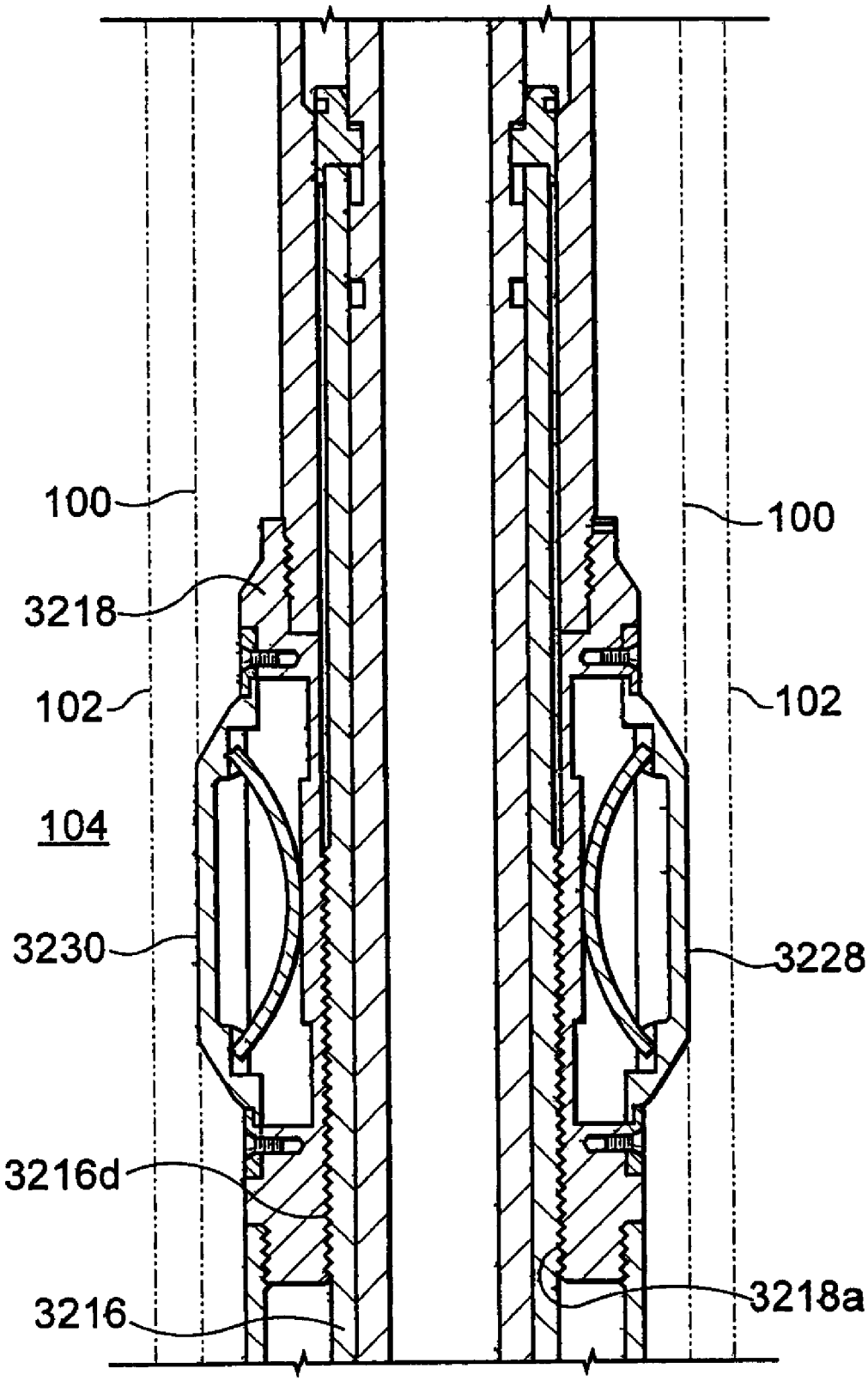
*Fig. 20E2*

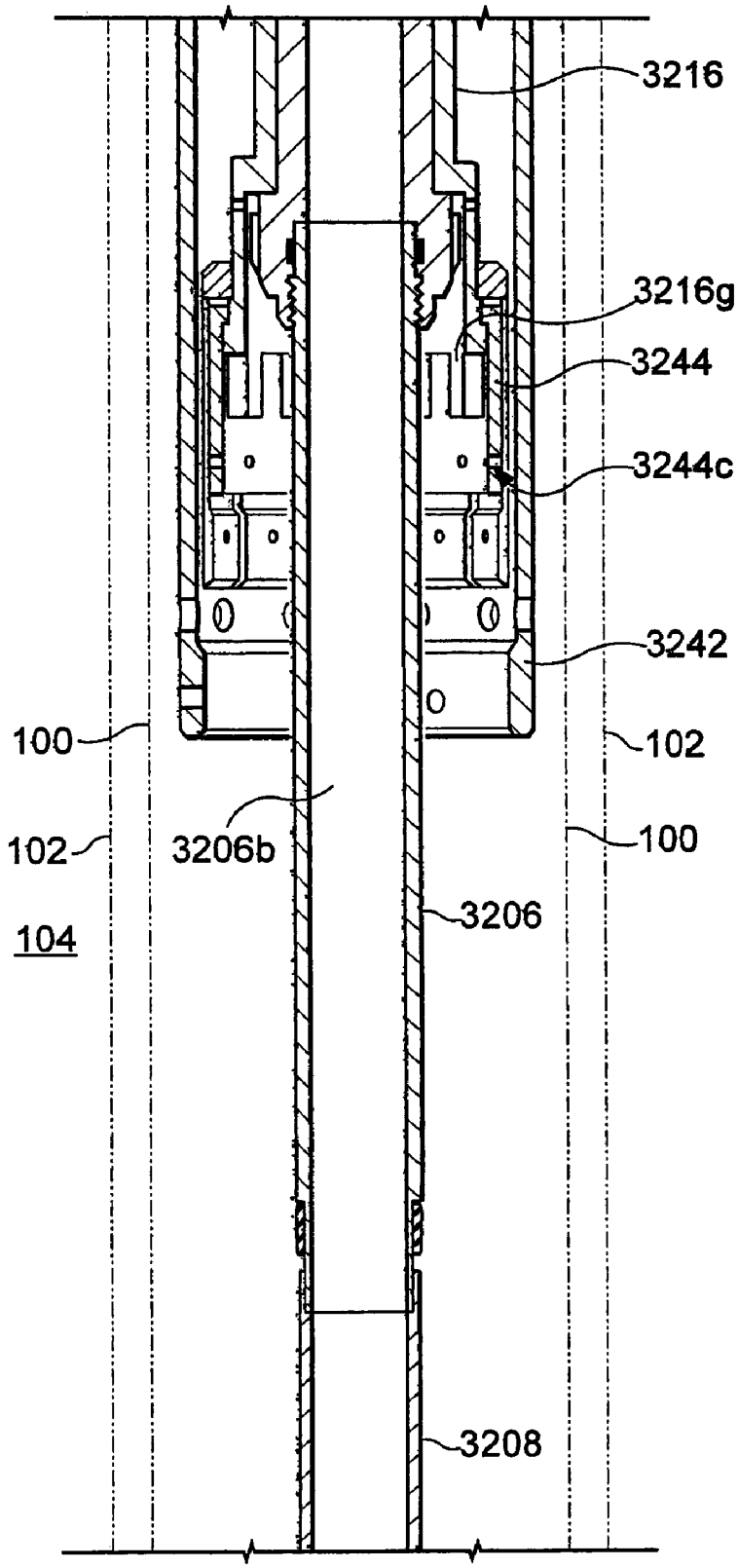
*Fig. 20E3*

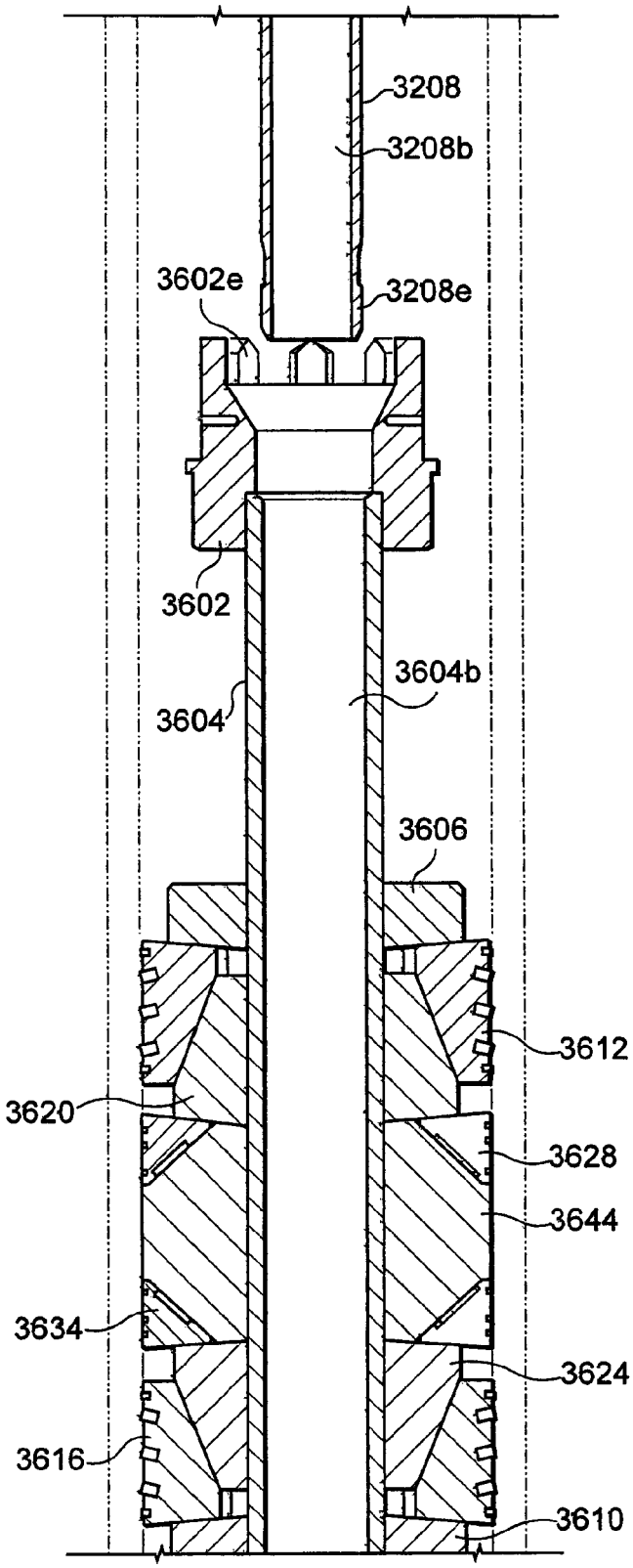
*Fig. 20E4*

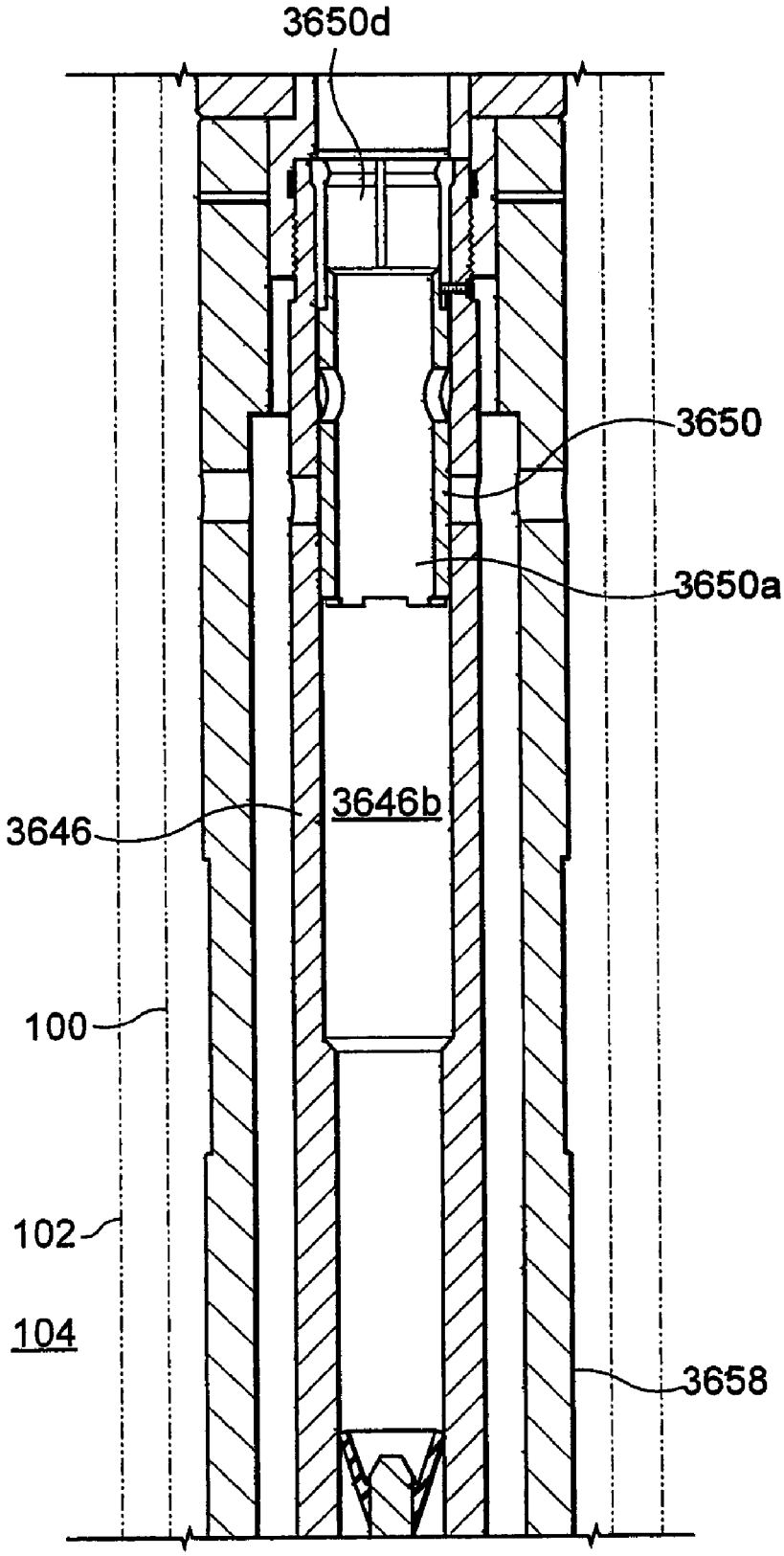
*Fig. 20E5*

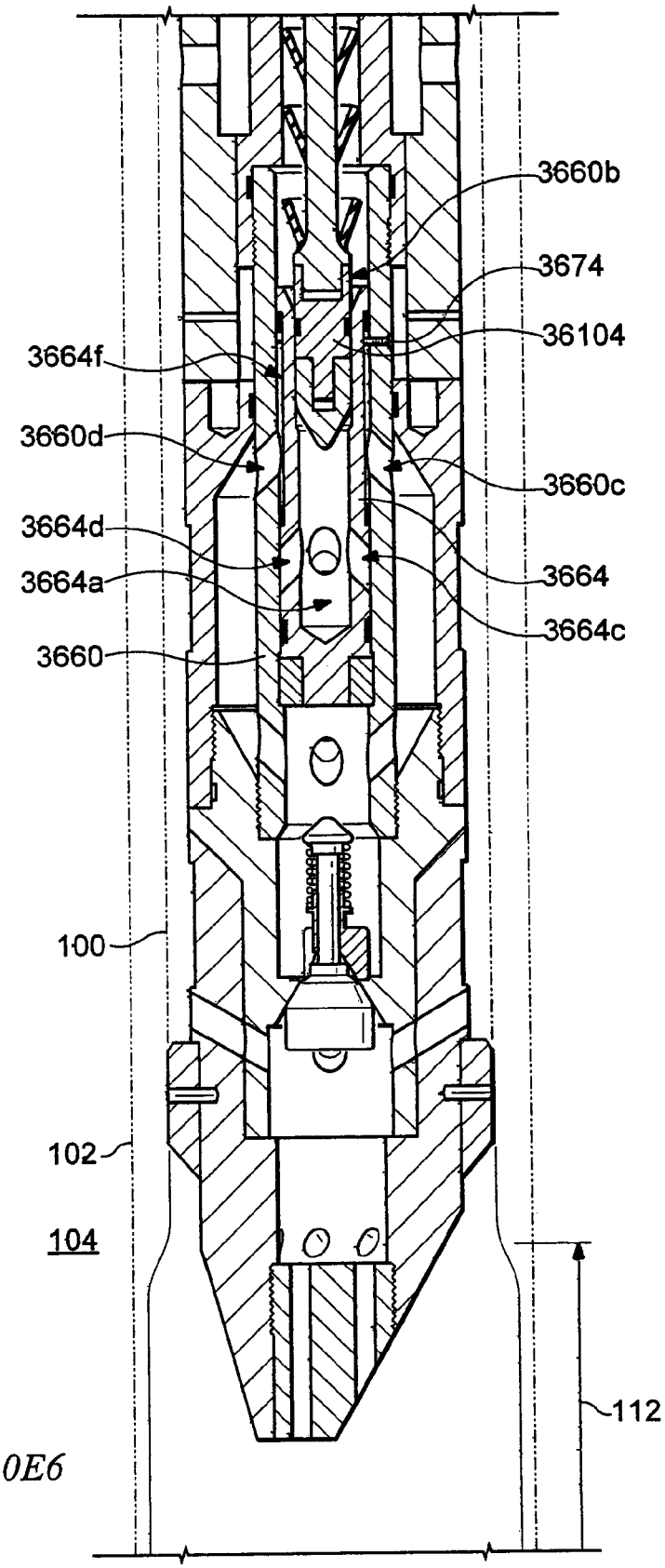
*Fig. 20E6*

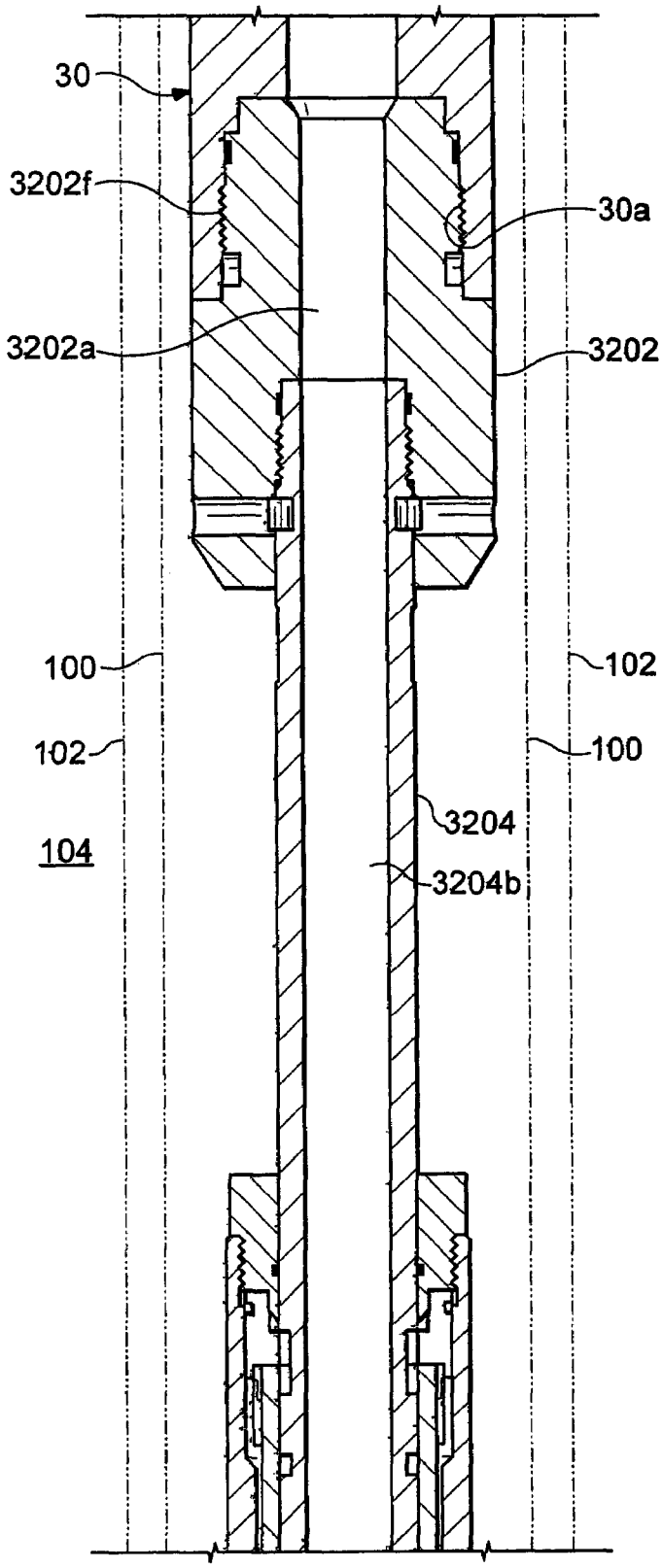
*Fig. 20F1*

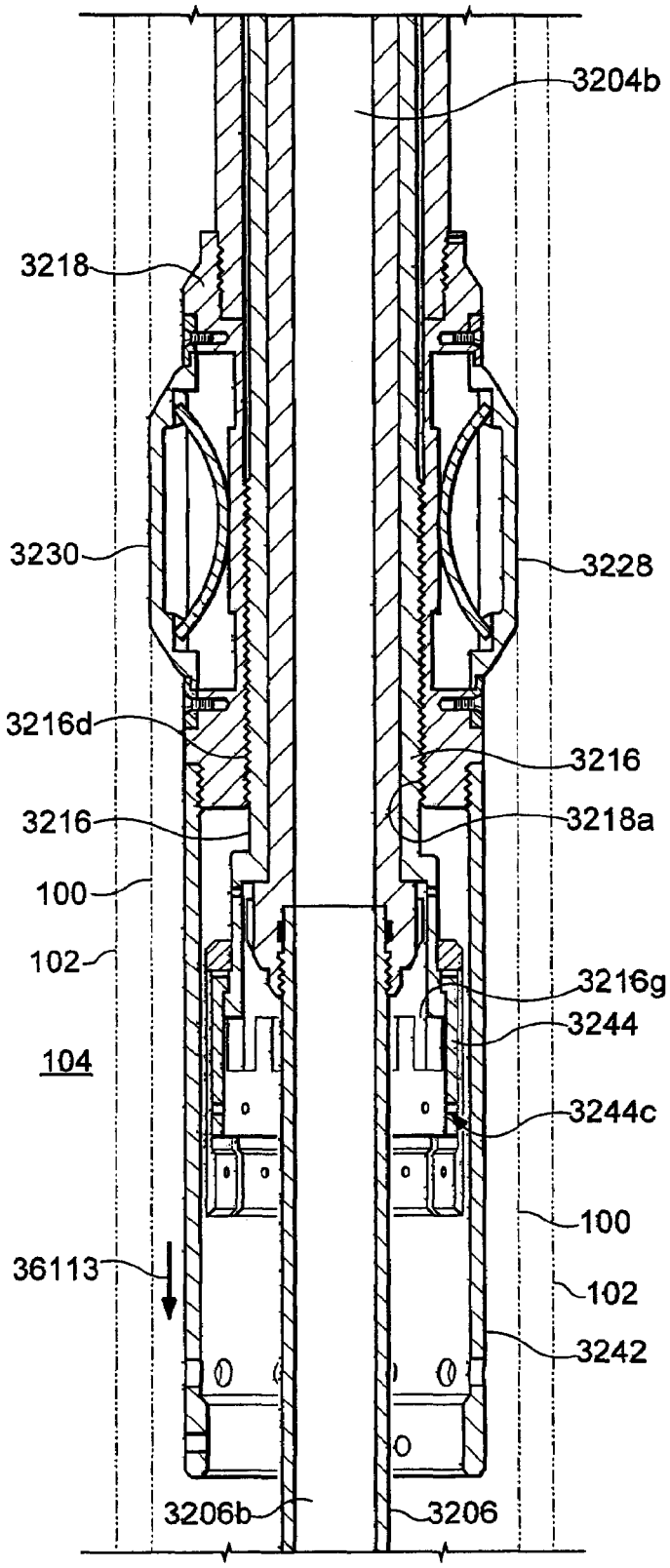
*Fig. 20F2*

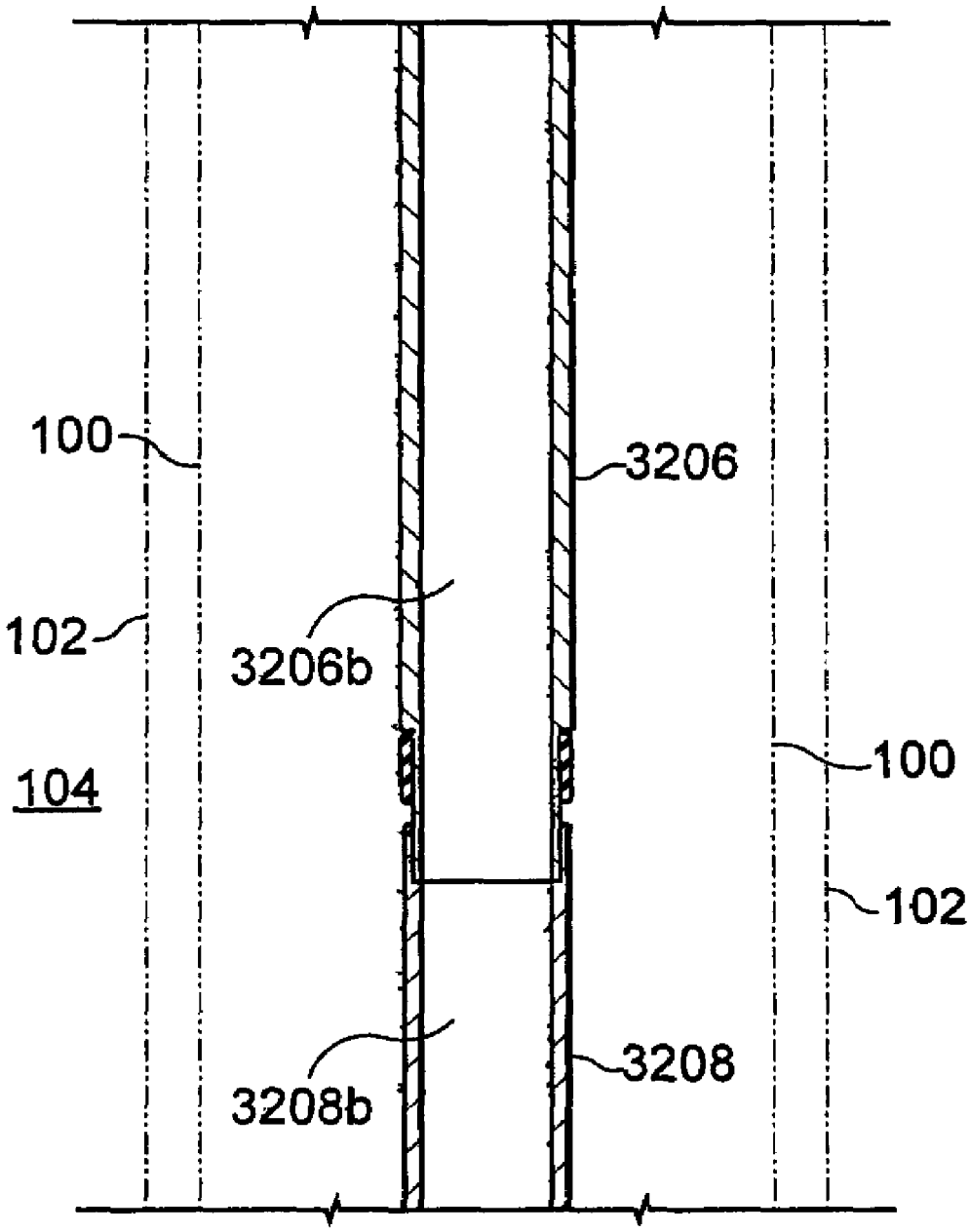
*Fig. 20F3*

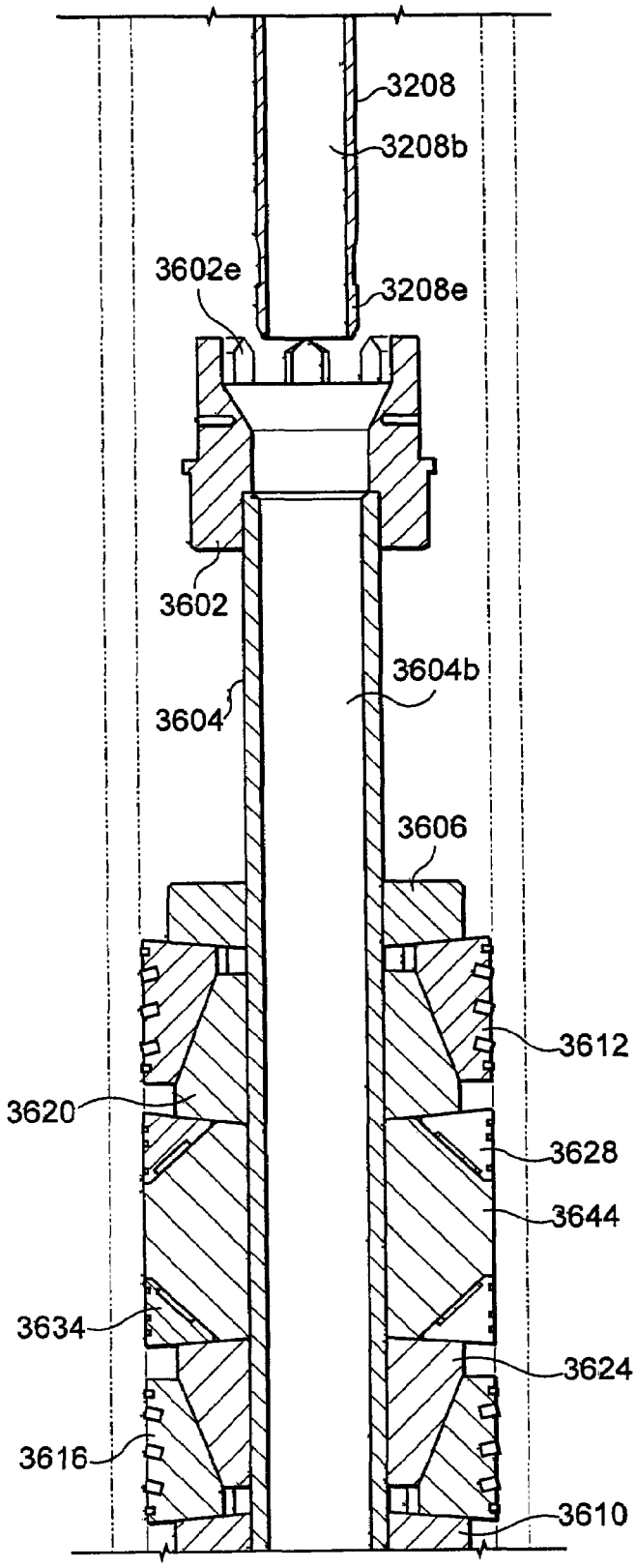
*Fig. 20F4*

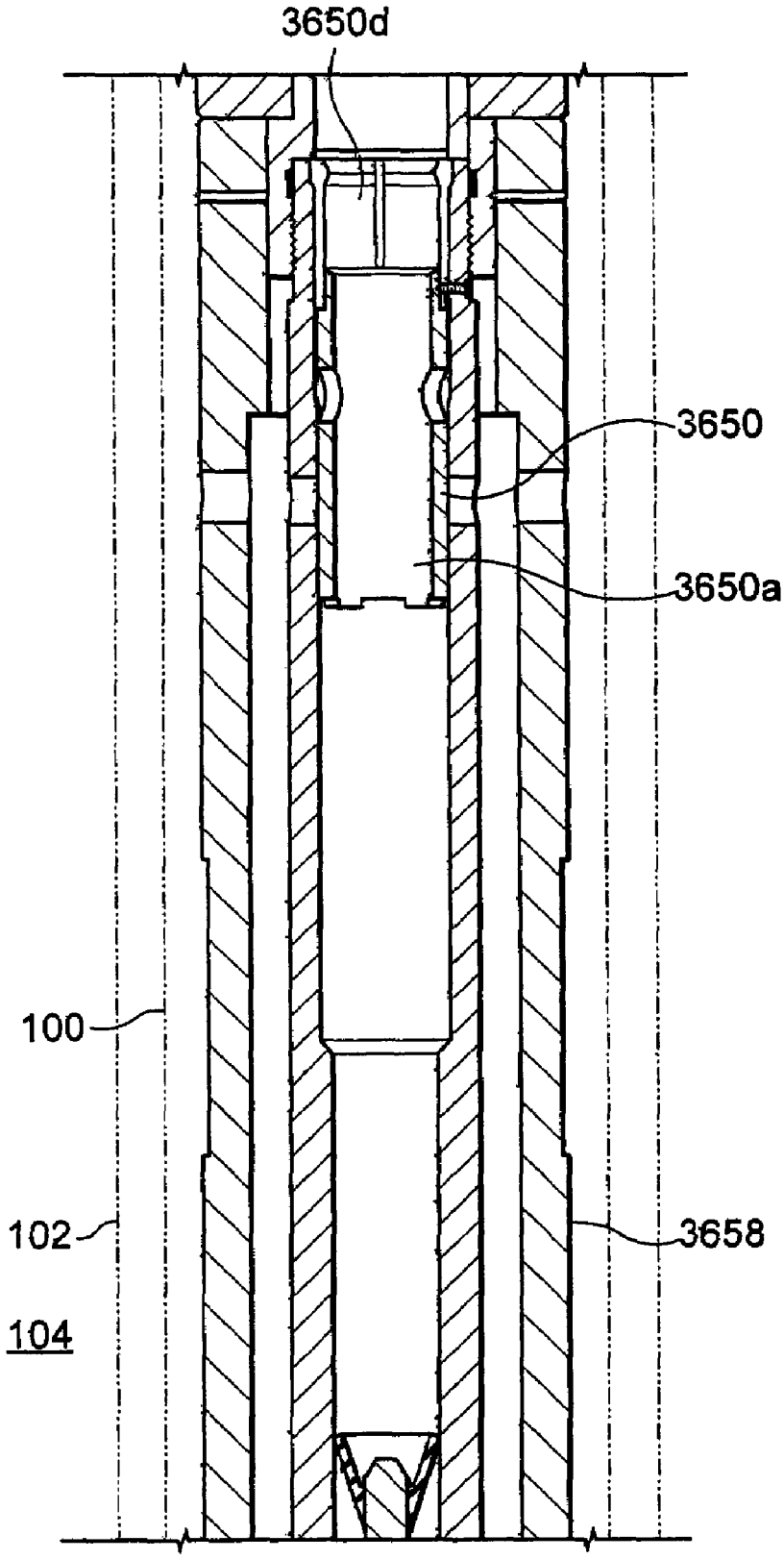
*Fig. 20F5*

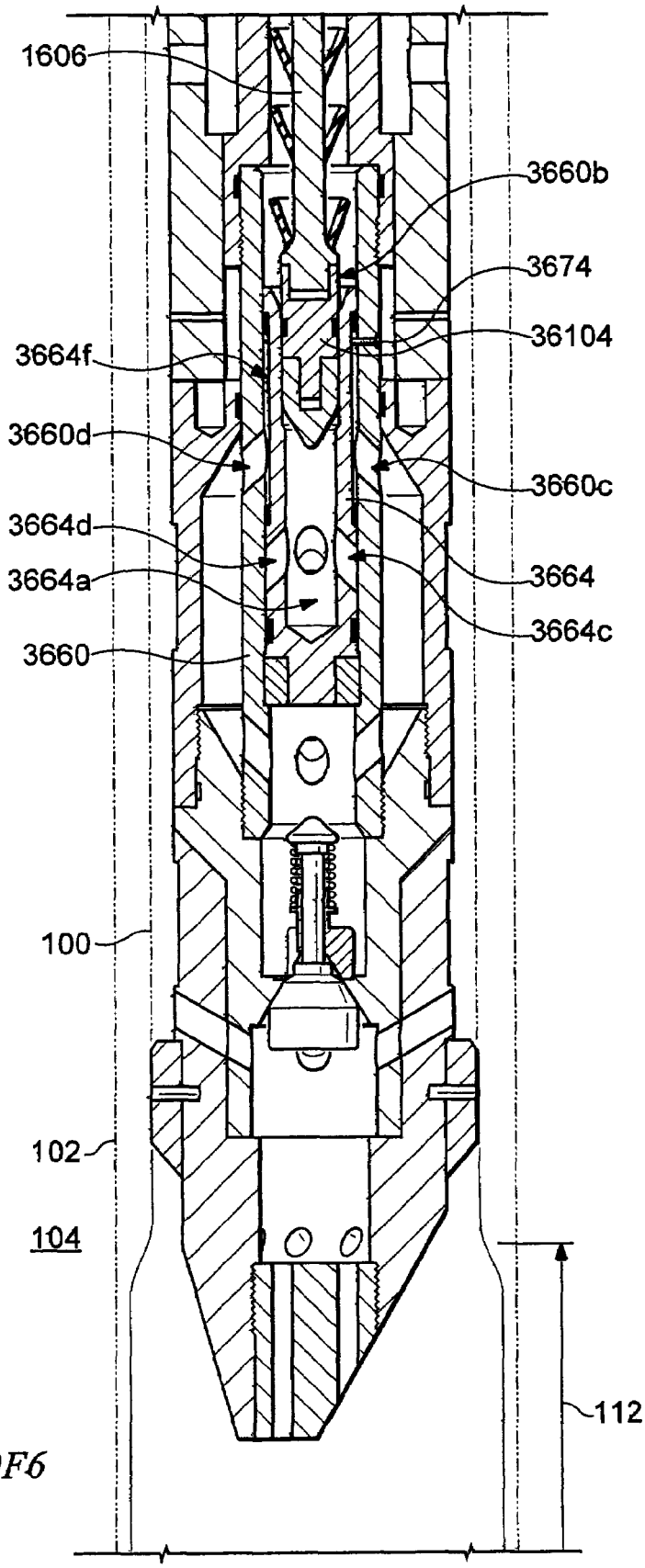
*Fig. 20F6*

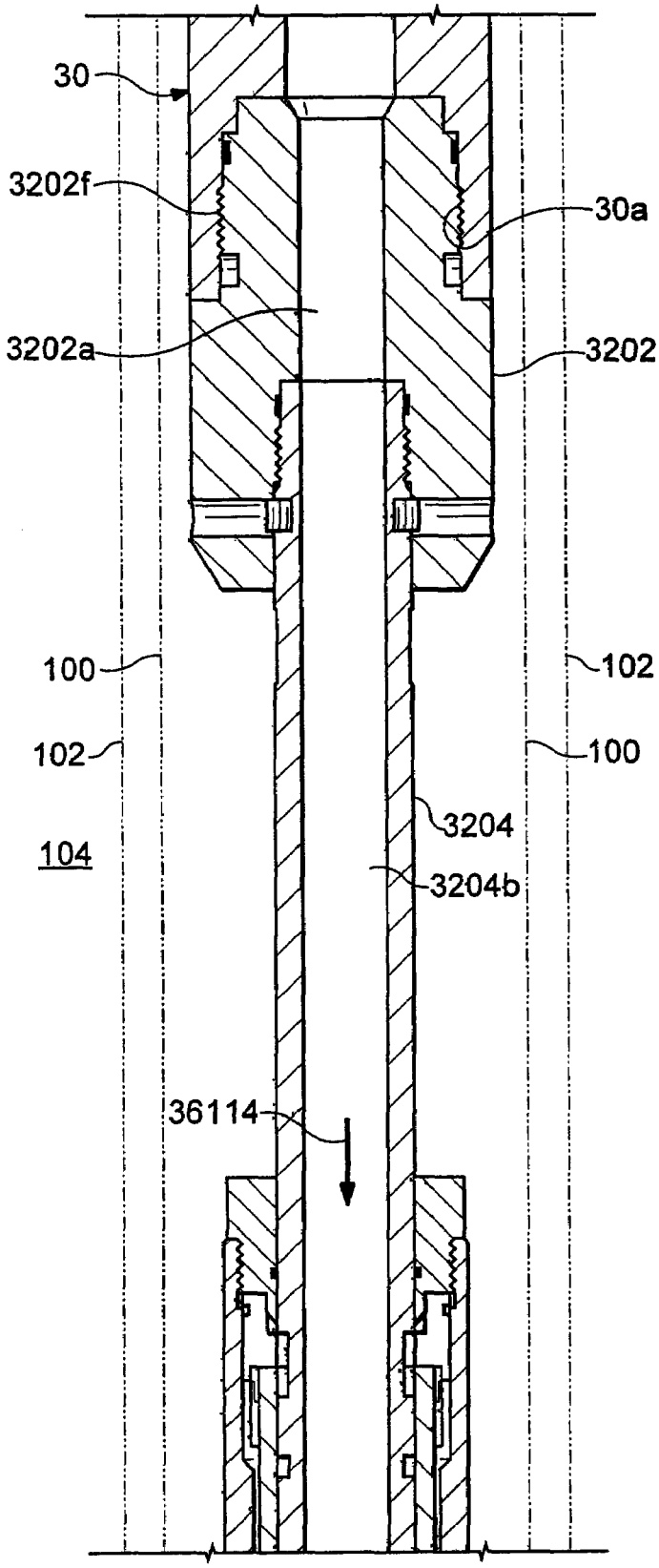
*Fig. 20G1*

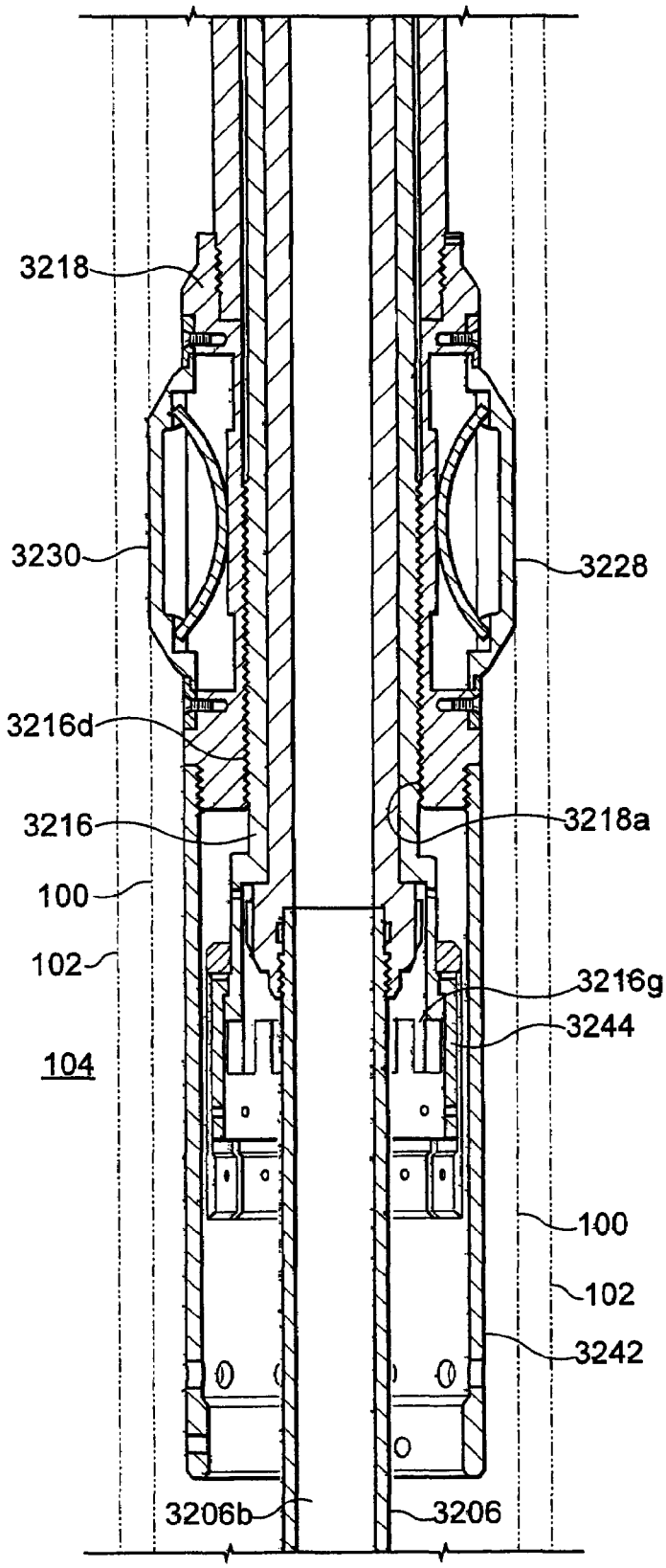
*Fig. 20G2*

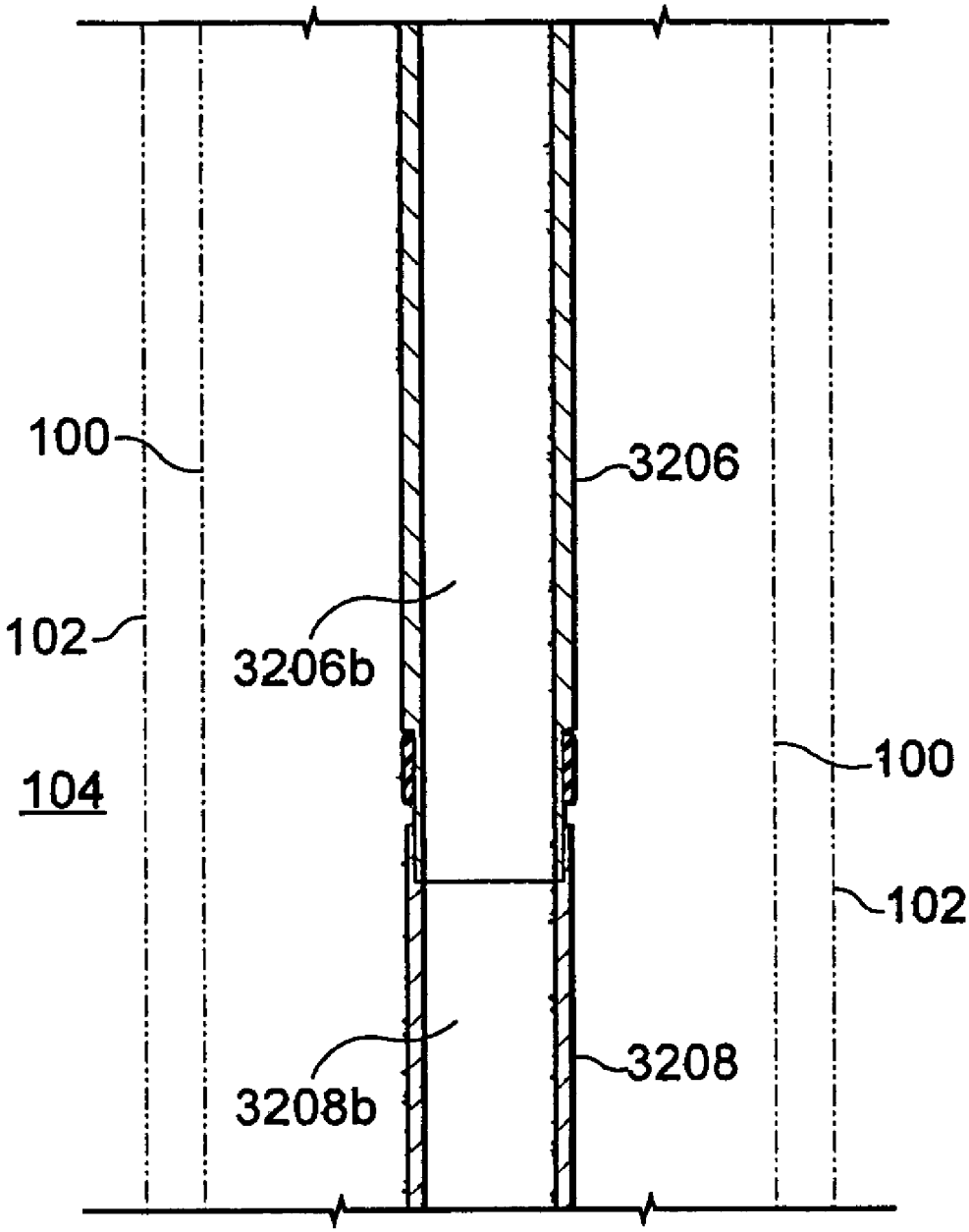
*Fig. 20G3*

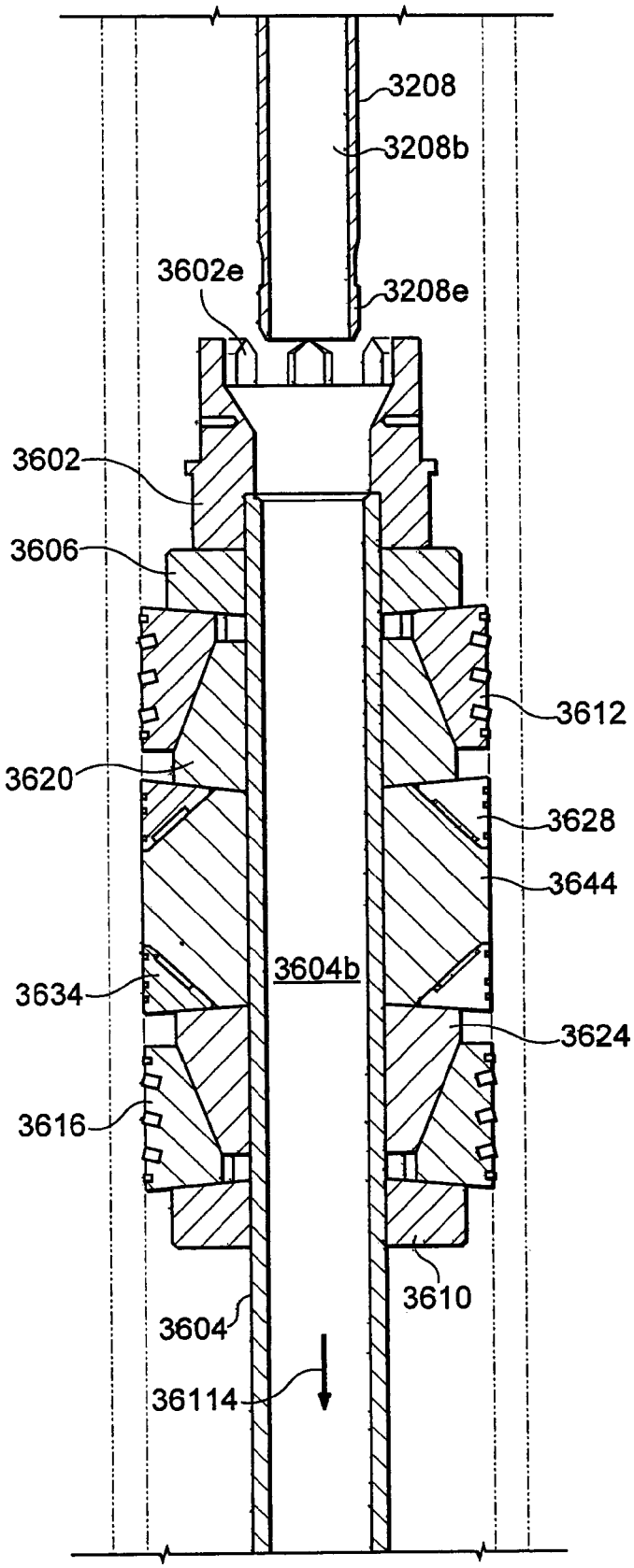
*Fig. 20G4*

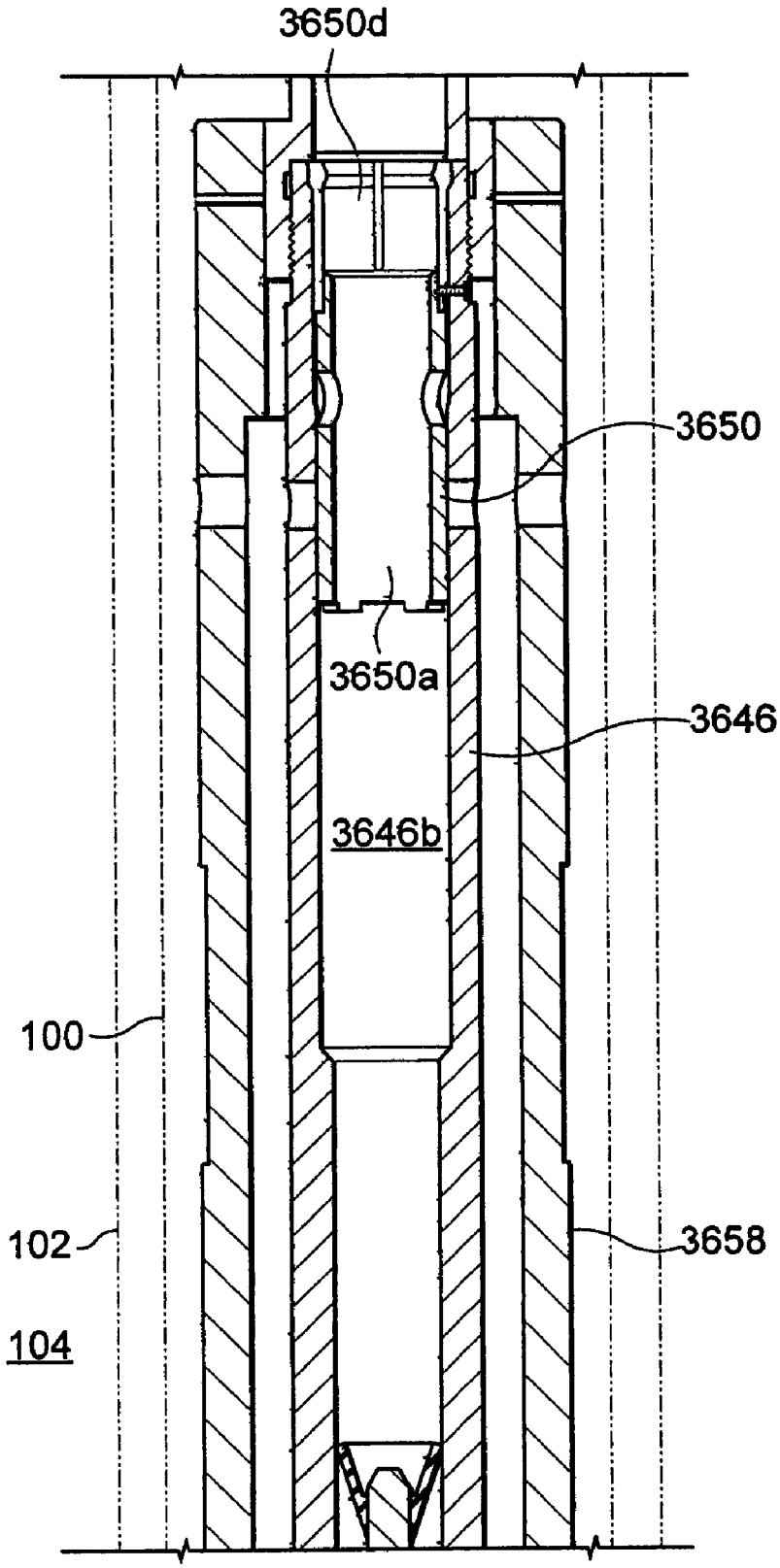
*Fig. 20G5*

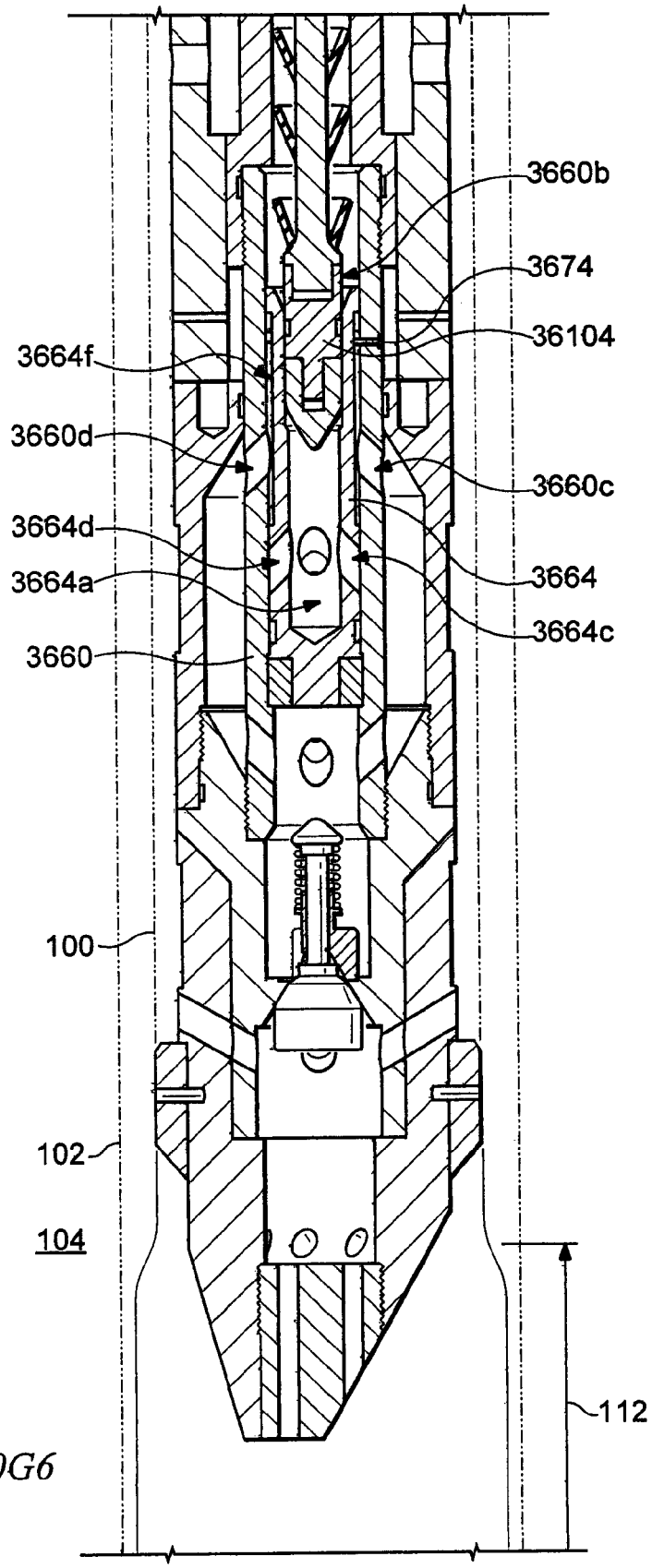
*Fig. 20G6*

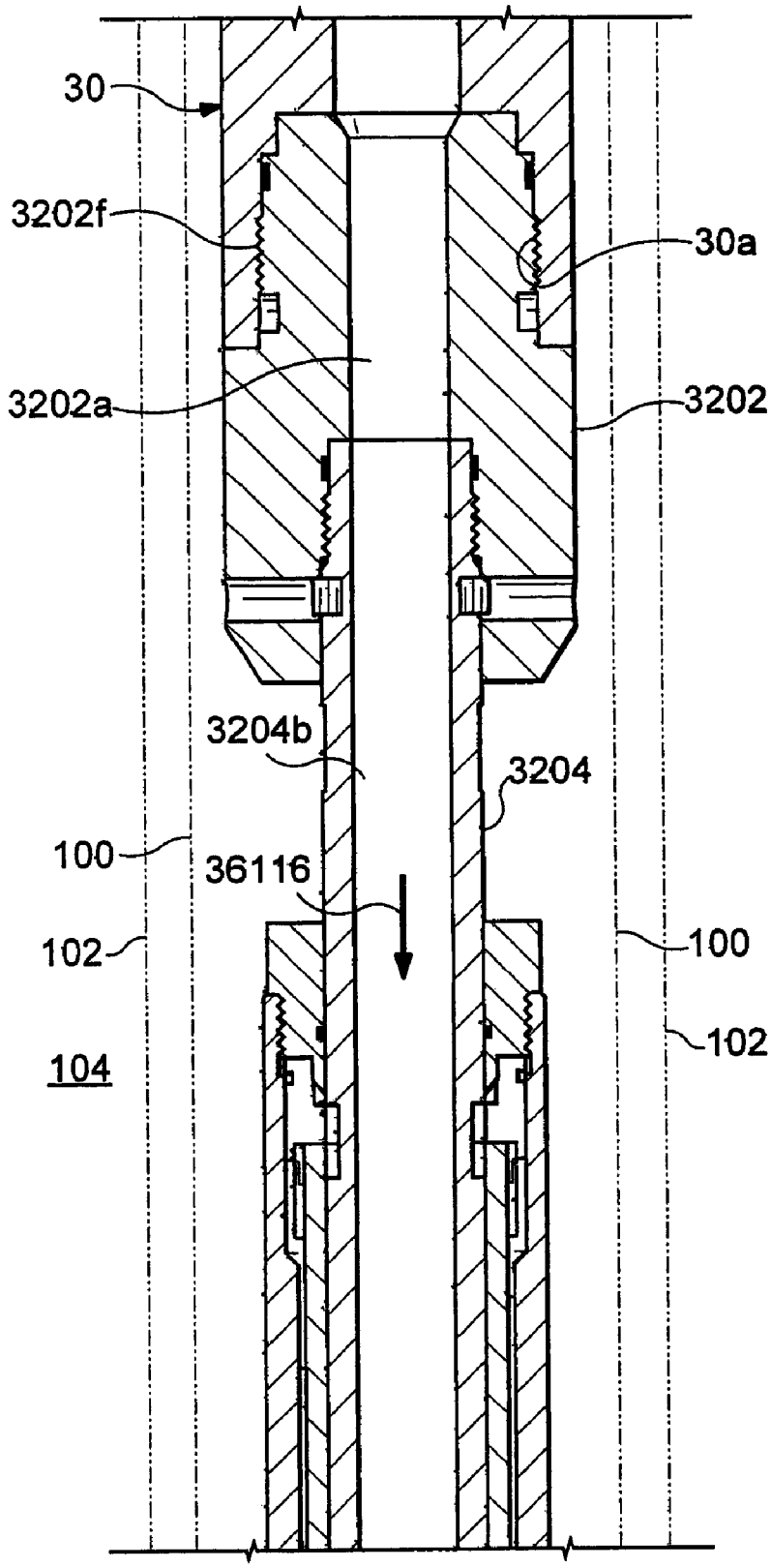
*Fig. 20H1*

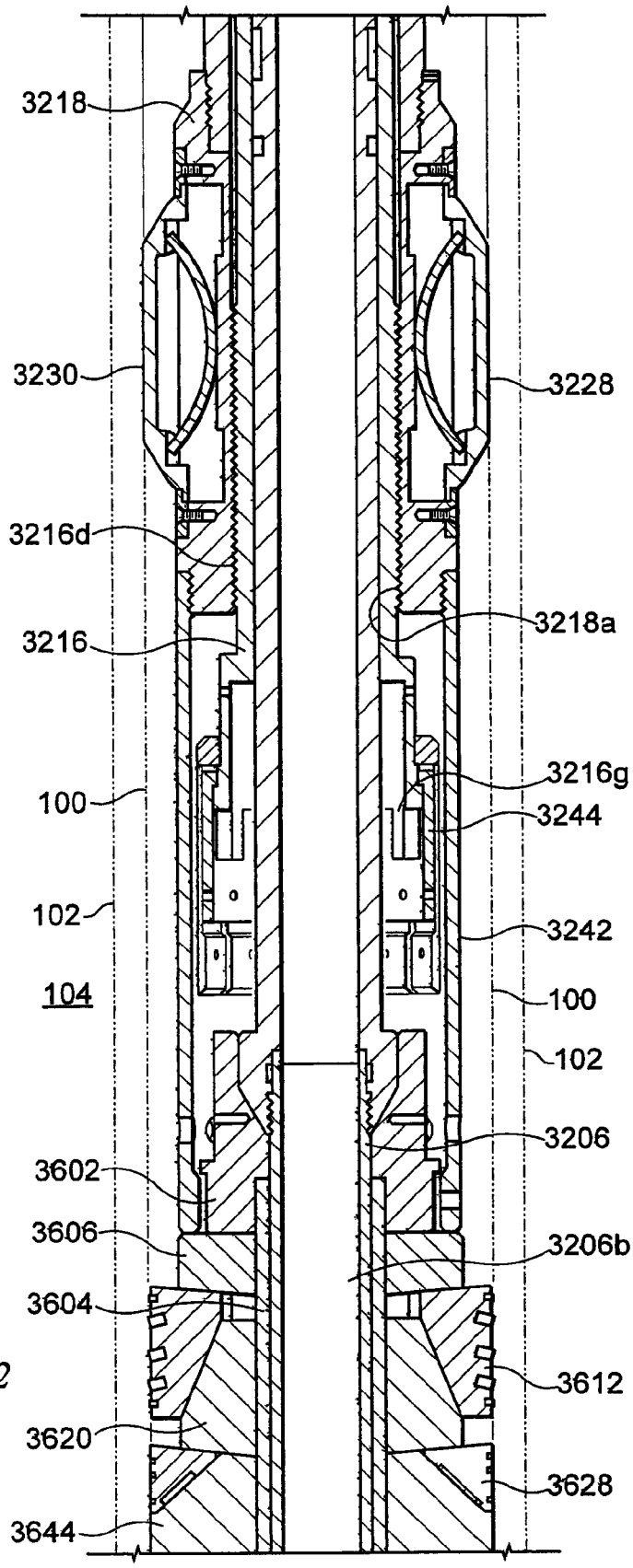
*Fig. 20H2*

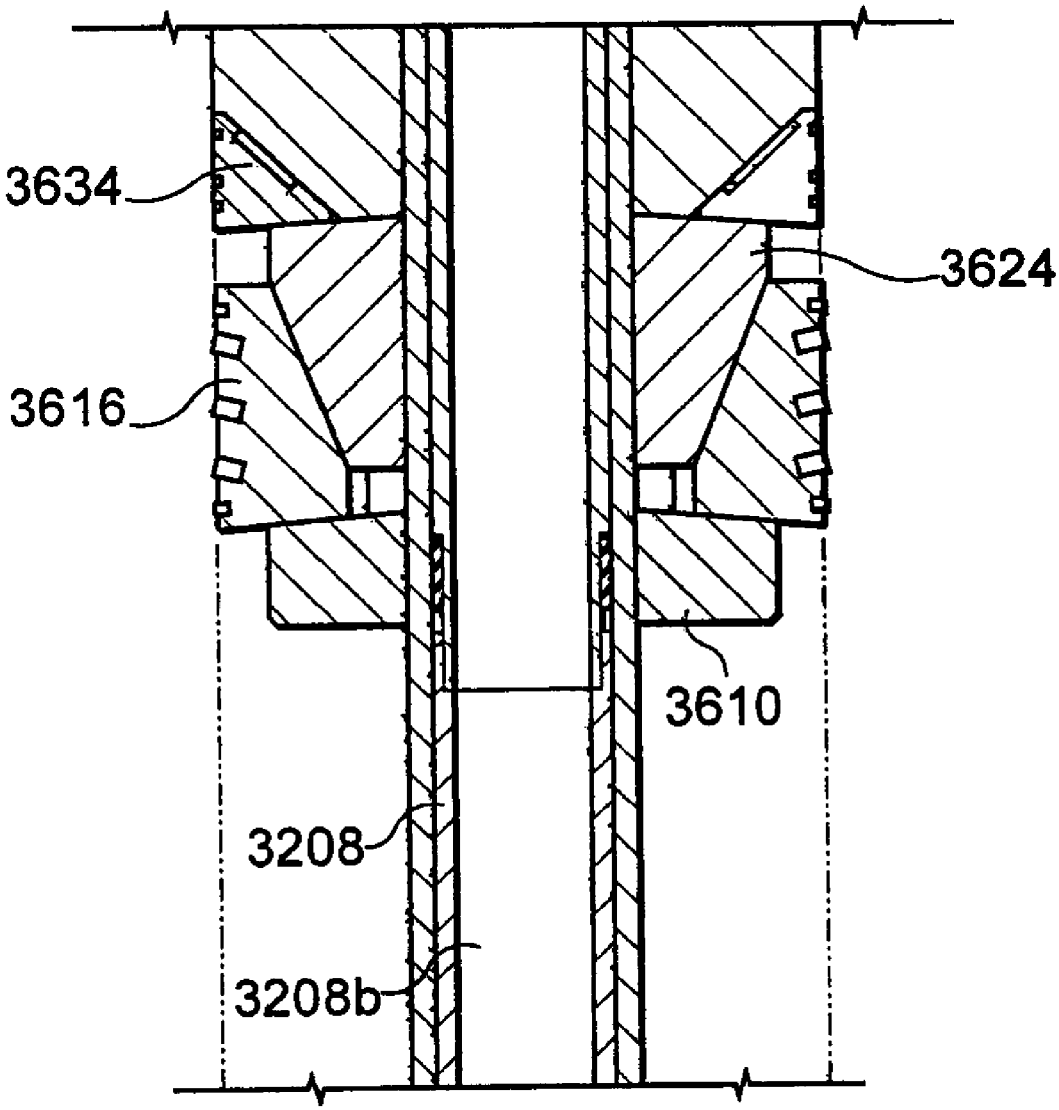
*Fig. 20H3*

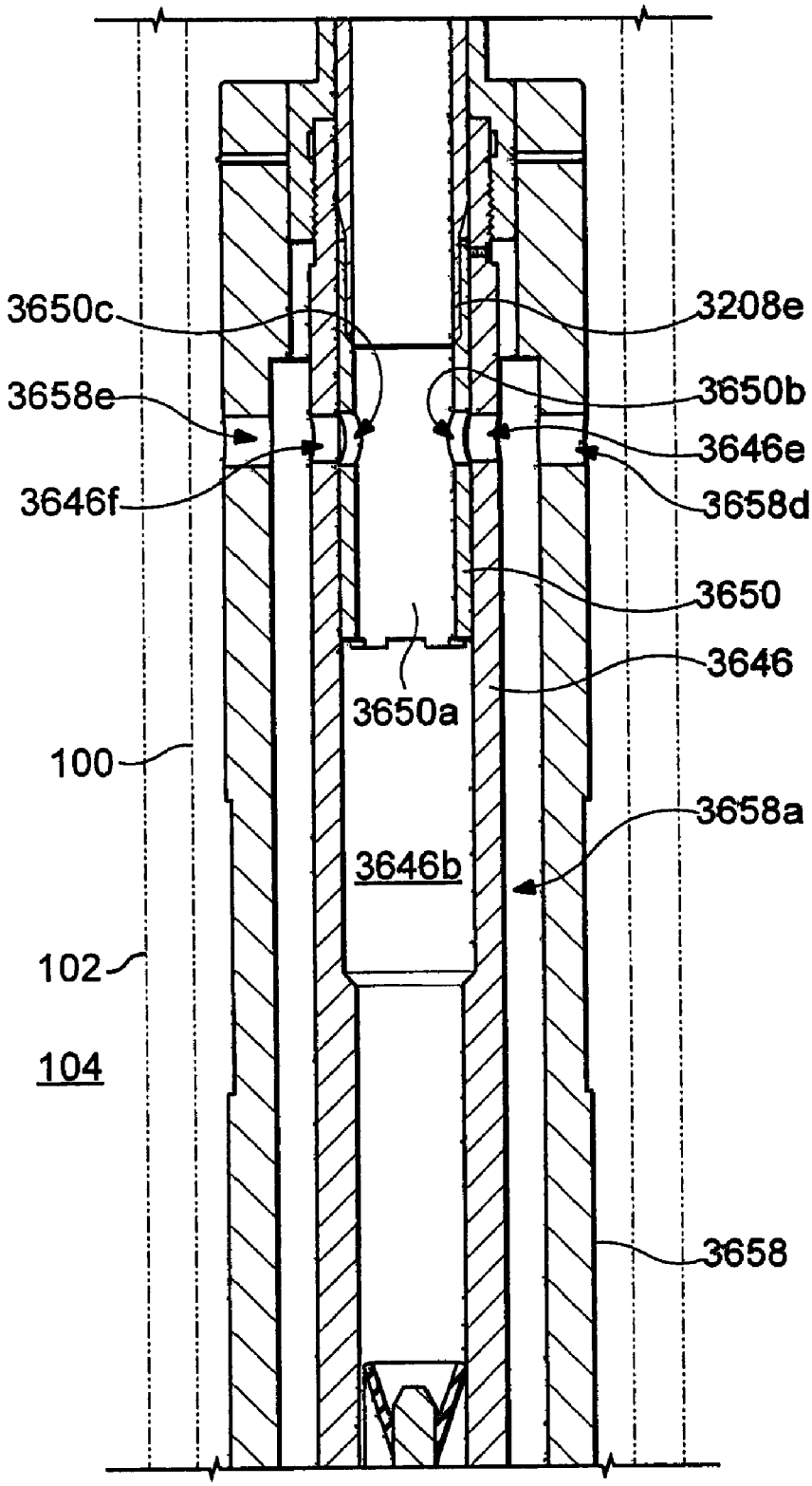
*Fig. 20H4*

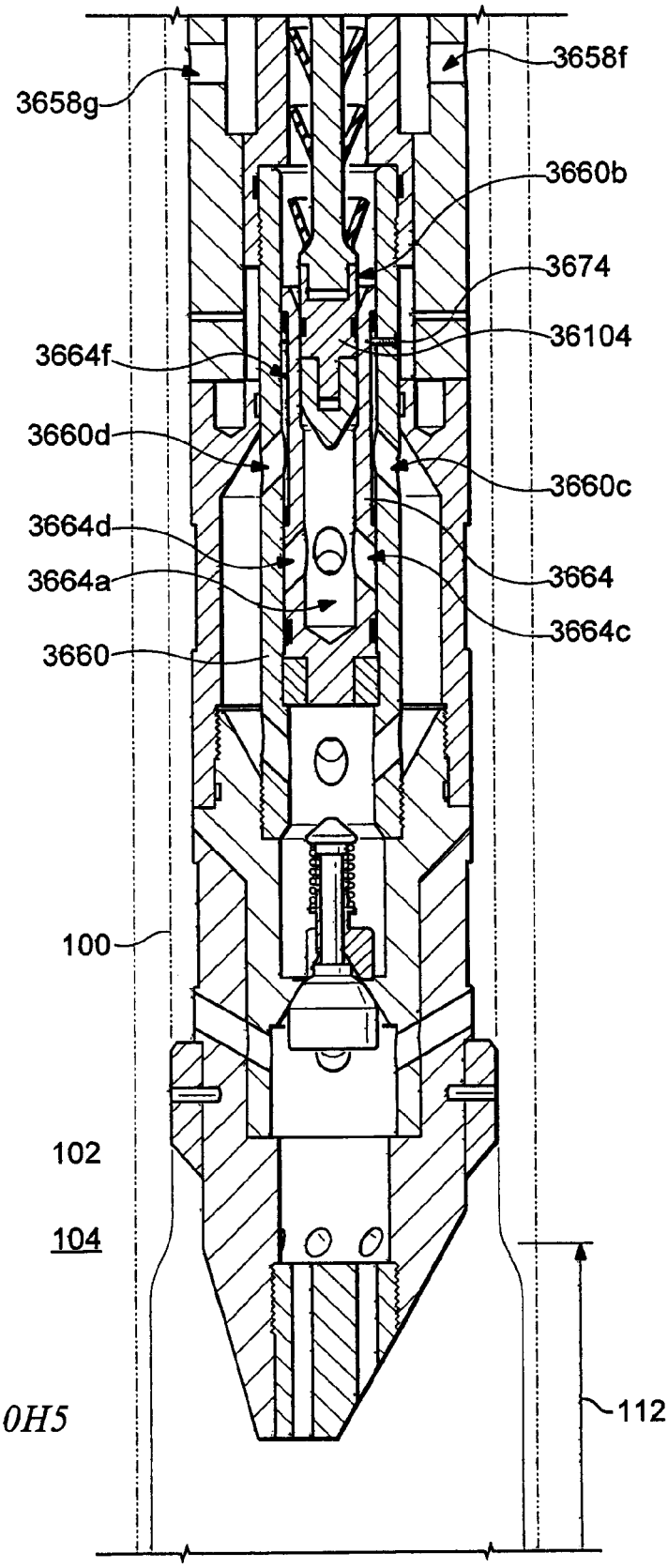
*Fig. 20H5*

SECTION B-B

SECTION C-C

6) TAG TOP OF SAFETY JOINT
7) ROTATE 10-3/4 THRU 12 TURNS AND MAKE UP TO SAFETY JOINT (2,000 FT-LBS)

8) TAG TO OHTD.

9) PU AND BEGIN CEMENTING
10) DROP DART

9) DART LANDS
10) PRESSURE UP TO 5,000 PSI

11) CREATE LAUNCHER SECTION
12) DISENGAGE CASING LOCK & RELEASE

13) HYDRAULICALLY EXPAND
14) CLAD INTO 7-5/8 CASING
15) POOH
16) DRILLOUT SHOE

APPARATUS FOR RADIALLY EXPANDING AND PLASTICALLY DEFORMING A TUBULAR MEMBER

CROSS REFERENCE TO RELATED APPLICATIONS

This application is a continuation-in-part of each of the following: a) U.S. patent application Ser. No. 10/488,574, filed Sep. 13, 2004 now U.S. Pat. No. 7,416,027, which was the National Stage filing of PCT patent application Ser. No. PCT/US02/25608, filed on Aug. 13, 2002, which claimed the benefit of the filing date of U.S. provisional patent application Ser. No. 60/318,021, filed on Sep. 7, 2001; b) U.S. patent application Ser. No. 10/517,755, filed Oct. 12, 2006 now abandoned, which was the National Stage filing of PCT patent application Ser. No. PCT/US03/018530, filed on Jun. 12, 2003, which claimed the benefit of the filing date of U.S. provisional patent application Ser. No. 60/387,961, filed on Jun. 12, 2002; c) U.S. patent application Ser. No. 10/553,566, filed Aug. 28, 2007, which was the National Stage filing of PCT patent application Ser. No. PCT/US04/011973, filed on Apr. 15, 2004, which claimed the benefit of the filing date of U.S. provisional patent application Ser. No. 60/463,586, filed on Apr. 17, 2003, which was a continuation-in-part of U.S. utility patent application Ser. No. 10/552,790, filed on Oct. 11, 2005, now abandoned which was the National Stage application for PCT patent application Ser. No. PCT/US2004/010712, filed on Apr. 6, 2004, which claimed the benefit of the filing date of U.S. provisional patent application Ser. No. 60/461,094, filed on Apr. 8, 2003, which was a continuation-in-part of U.S. utility patent application Ser. No. 10/552,253, filed on Oct. 4, 2005, now abandoned which was the National Stage application for PCT patent application Ser. No. PCT/2004/010762, filed on Apr. 6, 2004, which claimed the benefit of the filing date of U.S. provisional patent application Ser. No. 60/461,038, filed on Apr. 7, 2003, which was a continuation-in-part of U.S. utility patent application Ser. No. 10/551,880, filed on Sep. 30, 2005, which was the National Stage application for PCT patent application Ser. No. PCT/US04/010317, filed on Apr. 2, 2004, which claimed the benefit of the filing date of U.S. provisional patent application Ser. No. 60/4597,76, filed on Apr. 2, 2003, which was a continuation-in-part of U.S. utility patent application Ser. No. 10/550,906, filed on Sep. 27, 2005, which was the National Stage application for PCT patent application Ser. No. PCT/US2004/009434, filed on Mar. 26, 2004, which claimed the benefit of the filing date of U.S. provisional patent application Ser. No. 60/457,960, filed on Mar. 27, 2003, which was a continuation in part of U.S. utility patent application Ser. No. 10/548,934, filed on Sep. 12, 2005, which was the National Stage application for PCT patent application Ser. No. PCT/US2004/007711, filed on Mar. 11, 2004, which claimed the benefit of the filing date of U.S. provisional patent application Ser. No. 60/453,678, filed on Mar. 11, 2003, which was a continuation in part of U.S. utility patent application Ser. No. 10/528,497, filed on Oct. 28, 2005, which was the National Stage application for PCT patent application Ser. No. PCT/US03/29460, filed on Sep. 22, 2003, filed on Sep. 22, 2003, which claimed the benefit of the filing date of U.S. provisional patent application Ser. No. 60/412,488, filed on Sep. 20, 2002, which was a continuation in part of U.S. utility patent application Ser. No. 10/513,614 now abandoned, filed on Nov. 05, 2004, which was the National Stage application for PCT application Ser. No. PCT/US2003/014153, filed on May 06, 2003, which claimed the benefit of the filing date of U.S. provisional patent application Ser. No. 60/380,147, filed on May 06, 2002, which was a continuation-in-part of U.S. utility patent application Ser. No. 10/507,567, filed on Sep. 13, 2004, which was the National Stage application for PCT application Ser. No. PCT/US2003/004837, filed on Feb. 19, 2003, which claimed the benefit of the filing date of U.S. provisional patent application Ser. No. 60/363,829, filed on Mar. 13, 2002, which was a continuation-in-part of both of: (1) U.S. utility patent application Ser. No. 10/495,347, filed on May 12, 2004, now U.S. Pat. No. 7,383,889, which was filed as the National Stage application for PCT application Ser. No. PCT/US2002/036157, filed on Nov. 12, 2002, which claimed the benefit of the filing date of U.S. provisional application Ser. No. 60/338,996, filed on Nov. 12, 2001; and (2) U.S. utility patent application Ser. No. 10/495,344, filed on May 12, 2004, now U.S. Pat. Nol 7,383,889 which was filed as the National Stage application for PCT application Ser. No. PCT/US2002/036267, filed on Nov. 12, 2002, which claimed the benefit of the filing date of U.S. provisional application Ser. No. 60/339,013, filed on Nov. 12, 2001, the disclosures of which are incorporated herein by reference; and d) PCT patent application Ser. No. PCT/US06/0102171, filed on Mar. 21, 2006, which claimed the benefit of the filing date of the U.S. provisional patent application Ser. No. 60/663,913 the disclosures of which are incorporated herein by reference.

This application is related to the following co-pending applications: (1) U.S. Pat. No. 6,497,289, which was filed as U.S. patent application Ser. No. 09/454,139, filed on Dec. 3, 1999, which claims priority from provisional application 60/111,293, filed on Dec. 7, 1998, (2) U.S. patent application Ser. No. 09/510,913, filed on Feb. 23, 2000, which claims priority from provisional application 60/121,702, filed on Feb. 25, 1999, (3) U.S. patent application Ser. No. 09/502,350, filed on Feb. 10, 2000, now U.S. Pat. No. 6,823,937 which issued Nov. 30, 2004, which claims priority from provisional application 60/119,611, filed on Feb. 11, 1999, (4) U.S. Pat. No. 6,328,113, which was filed as U.S. patent application Ser. No. 09/440,338, filed on Nov. 15, 1999, which claims priority from provisional application 60/108,558, filed on Nov. 16, 1998, (5) U.S. patent application Ser. No. 10/169,434, filed on Jul. 1, 2002, which claims priority from provisional application 60/183,546, filed on Feb. 18, 2000, (6) U.S. Pat. No. 6,640,903 which was filed as U.S. patent application Ser. No. 09/523,468, filed on Mar. 10, 2000, which claims priority from provisional application 60/124,042, filed on Mar. 11, 1999, (7) U.S. Pat. No. 6,568,471, which was filed as patent application Ser. No. 09/512,895, filed on Feb. 24, 2000, which claims priority from provisional application 60/121,841, filed on Feb. 26, 1999, (8) U.S. Pat. No. 6,575,240, which was filed as patent application Ser. No. 09/511,941, filed on Feb. 24, 2000, which claims priority from provisional application 60/121,907, filed on Feb. 26, 1999, (9) U.S. Pat. No. 6,557,640, which was filed as patent application Ser. No. 09/588,946, filed on Jun. 7, 2000, which claims priority from provisional application 60/137,998, filed on Jun. 7, 1999, (10) U.S. patent application Ser. No. 09/981,916, filed on Oct. 18, 2001 as a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (11) U.S. Pat. No. 6,604,763, which was filed as application Ser. No. 09/559,122, filed on Apr. 26, 2000, which claims priority from provisional application 60/131,106, filed on Apr. 26, 1999, (12) U.S. patent application Ser. No. 10/030,593, filed on Jan. 8, 2002, which claims priority from provisional application 60/146,203, filed on Jul. 29, 1999, (13) U.S. provisional patent application Ser. No. 60/143,039, filed on Jul. 9, 1999, (14) U.S. patent application Ser. No. 10/111,982, filed on Apr. 30, 2002, which claims priority from provisional patent application Ser. No. 60/162,671, filed on Nov. 1, 1999, (15) U.S. provisional patent application Ser. No. 60/154,047, filed on Sep. 16, 1999, (16) U.S. provisional patent application Ser. No. 60/438,828, filed on Jan. 9, 2003, (17) U.S. Pat. No. 6,564,875, which was filed as application Ser. No. 09/679,907, on Oct. 5, 2000, which claims priority from provisional patent application Ser. No. 60/159,082, filed on Oct. 12, 1999, (18) U.S. patent application Ser. No. 10/089,419, filed on Mar. 27, 2002, now U.S. Pat. No. 6,695,012 which issued Feb. 24, 2004, which claims priority from provisional patent application Ser. No. 60/159,039, filed on Oct. 12, 1999, (19) U.S. patent application Ser. No. 09/679,906, filed on Oct. 5, 2000, which claims priority from provisional patent application Ser. No. 60/159,033, filed on Oct. 12, 1999, (20) U.S. patent application Ser. No. 10/303,992, filed on Nov. 22, 2002, which claims priority from provisional patent application Ser. No. 60/212,359, filed on Jun. 19, 2000, (21) U.S. provisional patent application Ser. No. 60/165,228, filed on Nov. 12, 1999, (22) U.S. provisional patent application Ser. No. 60/455,051, filed on Mar. 14, 2003, (23) PCT application US02/2477, filed on Jun. 26, 2002, which claims priority from U.S. provisional patent application Ser. No. 60/303,711, filed on Jul. 6, 2001, (24) U.S. patent application Ser. No. 10/311,412, filed on Dec. 12, 2002, which claims priority from provisional patent application Ser. No. 60/221,443, filed on Jul. 28, 2000, (25) U.S. patent application Ser. No. 10/322,947, filed on Dec. 18, 2002, which claims priority from provisional patent application Ser. No. 60/221,645, filed on Jul. 28, 2000, (26) U.S. patent application Ser. No. 10/322,947, filed on Jan. 22, 2003, now U.S. Pat. No. 6,976,541 which issued Dec. 20, 2005, which claims priority from provisional patent application Ser. No. 60/233,638, filed on Sep. 18, 2000, (27) U.S. patent application Ser. No. 10/406,648, filed on Mar. 31, 2003, which claims priority from provisional patent application Ser. No. 60/237,334, filed on Oct. 2, 2000, (28) PCT application US02/04353, filed on Feb. 14, 2002, which claims priority from U.S. provisional patent application Ser. No. 60/270,007, filed on Feb. 20, 2001, (29) U.S. patent application Ser. No. 10/465,835, filed on Jun. 13, 2003, which claims priority from provisional patent application Ser. No. 60/262,434, filed on Jan. 17, 2001, (30) U.S. patent application Ser. No. 10/465,831, filed on Jun. 13, 2003, which claims priority from U.S. provisional patent application Ser. No. 60/259,486, filed on Jan. 3, 2001, (31) U.S. provisional patent application Ser. No. 60/452,303, filed on Mar. 5, 2003, U.S. Pat. No. 6,470,966, which was filed as patent application Ser. No. 09/850,093, filed on May 7, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (33) U.S. Pat. No. 6,561,227, which was filed as patent application Ser. No. 09/852,026, filed on May 9, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (34) U.S. patent application Ser. No. 09/852,027, filed on May 9, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (35) PCT Application US02/25608, filed on Aug. 13, 2002, which claims priority from provisional application 60/318,021, filed on Sep. 7, 2001, PCT Application US02/24399, filed on Aug. 1, 2002, which claims priority from U.S. provisional patent application Ser. No. 60/313,453, filed on Aug. 20, 2001, (37) PCT Application US02/29856, filed on Sep. 19, 2002, which claims priority from U.S. provisional patent application Ser. No. 60/326,886, filed on Oct. 3, 2001, (38) PCT Application US02/20256, filed on Jun. 26, 2002, which claims priority from U.S. provisional patent application Ser. No. 60/303,740, filed on Jul. 6, 2001, (39) U.S. patent application Ser. No. 09/962,469, filed on Sep. 25, 2001, now U.S. Pat. No. 6,892,819 which issued May 17, 2005, which is a divisional of U.S. patent application Ser. No. 09/523,468, filed on Mar. 10, 2000, (now U.S. Pat. No. 6,640,903 which issued Nov. 4, 2003), which claims priority from provisional application 60/124,042, filed on Mar. 11, 1999, (40) U.S. patent application Ser. No. 09/962,470, filed on Sep. 25, 2001, which is a divisional of U.S. patent application Ser. No. 09/523,468, filed on Mar. 10, 2000, (now U.S. Pat. No. 6,640,903 which issued Nov. 4, 2003), which claims priority from provisional application 60/124,042, filed on Mar. 11, 1999, (41) U.S. patent application Ser. No. 09/962,471, filed on Sep. 25, 2001, now U.S. Pat. No. 6,739,392 which issued May 25, 2004, which is a divisional of U.S. patent application Ser. No. 09/523,468, filed on Mar. 10, 2000, (now U.S. Pat. No. 6,640,903 which issued Nov. 4, 2003), which claims priority from provisional application 60/124,042, filed on Mar. 11, 1999, (42) U.S. patent application Ser. No. 09/962,467, filed on Sep. 25, 2001, now U.S. Pat. No. 6,725,919 which issued Apr. 27, 2004, which is a divisional of U.S. patent application Ser. No. 09/523,468, filed on Mar. 10, 2000, (now U.S. Pat. No. 6,640,903 which issued Nov. 4, 2003), which claims priority from provisional application 60/124,042, filed on Mar. 11, 1999, (43) U.S. patent application Ser. No. 09/962,468, filed on Sep. 25, 2001, now U.S. Pat. No. 6,758,278 which issued Jul. 6, 2004, which is a divisional of U.S. patent application Ser. No. 09/523,468, filed on Mar. 10, 2000, (now U.S. Pat. No. 6,640,903 which issued Nov. 4, 2003), which claims priority from provisional application 60/124,042, filed on Mar. 11, 1999, (44) PCT application US 02/25727, filed on Aug. 14, 2002, which claims priority from U.S. provisional patent application Ser. No. 60/317,985, filed on Sep. 6, 2001, and U.S. provisional patent application Ser. No. 60/318,386, filed on Sep. 10, 2001, (45) PCT application US 02/39425, filed on Dec. 10, 2002, which claims priority from U.S. provisional patent application Ser. No. 60/343,674, filed on Dec. 27, 2001, (46) U.S. utility patent application Ser. No. 09/969,922, filed on Oct. 3, 2001, (now U.S. Pat. No. 6,634,431 which issued Oct. 21, 2003), which is a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (47) U.S. utility patent application Ser. No. 10/516,467, now U.S. Pat. No. 6,745,845 which issued Jun. 6, 2004, filed on Dec. 10, 2001, which is a continuation application of U.S. utility patent application Ser. No. 09/969,922, filed on Oct. 3, 2001, (now U.S. Pat. No. 6,634,431 which issued Oct. 21, 2003), which is a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (48) PCT application US 03/00609, filed on Jan. 9, 2003, which claims priority from U.S. provisional patent application Ser. No. 60/357,372, filed on Feb. 15, 2002, (49) U.S. patent application Ser. No. 10/074,703, now U.S. Pat. No. 6,705,395 which issued Mar. 16, 2004, filed on Feb. 12, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (50) U.S. patent application Ser. No. 10/074,244, filed on Feb. 12, 2002, now U.S. Pat. No. 6,631,759 which issued Oct. 14, 2003, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (51) U.S. patent application Ser. No. 10/076,660, filed on Feb. 15, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (52) U.S. patent application Ser. No. 10/076,661, filed on Feb. 15, 2002, now U.S. Pat. No. 6,631,769 which issued Oct. 14, 2003, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (53) U.S. patent application Ser. No. 10/076,659, filed on Feb. 15, 2002, now U.S. Pat. No. 7,063,142 which issued Jun. 20, 2006, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (54) U.S. patent application Ser. No. 10/078,928, filed on Feb. 20, 2002, now U.S. Pat. No. 6,684,947 which issued Feb. 3, 2004, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (55) U.S. patent application Ser. No. 10/078,922, filed on Feb. 20, 2002, now U.S. Pat. No. 6,966,370 which issued Nov. 22, 2005, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (56) U.S. patent application Ser. No. 10/078,921, filed on Feb. 20, 2002, now U.S. Pat. No. 7,044,221 which issued May 16, 2006, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (57) U.S. patent application Ser. No. 10/261,928, filed on Oct. 1, 2002, now U.S. Pat. No. 7,011,161 which issued Mar. 14, 2006, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (58) U.S. patent application Ser. No. 10/079,276, filed on Feb. 20, 2002, now U.S. Pat. No. 7,040,396 which issued May 9, 2006, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (59) U.S. patent application Ser. No. 10/262,009, filed on Oct. 1, 2002, now U.S. Pat. No. 7,048,062 which issued May 23, 2006, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (60) U.S. patent application Ser. No. 10/092,481, filed on Mar. 7, 2002, now U.S. Pat. No. 6,857,473 which issued Feb. 22, 2005, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (61) U.S. patent application Ser. No. 10/261,926, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (62) PCT application US 02/36157, filed on Nov. 12, 2002, which claims priority from U.S. provisional patent application Ser. No. 60/338,996,filed on Nov. 12, 2001, (63) PCT application US 02/36267, filed on Nov. 12, 2002, which claims priority from U.S. provisional patent application Ser. No. 60/339,013, filed on Nov. 12, 2001, (64) PCT application US 03/11765, filed on Apr. 16, 2003, which claims priority from U.S. provisional patent application Ser. No. 60/383,917, filed on May 29, 2002, (65) PCT application US 03/15020, filed on May 12, 2003, which claims priority from U.S. provisional patent application Ser. No. 60/391,703, filed on Jun. 26, 2002, (66) PCT application US 02/39418, filed on Dec. 10, 2002, which claims priority from U.S. provisional patent application Ser. No. 60/346,309, filed on Jan. 7, 2002, (67) PCT application US 03/06544, filed on Mar. 4, 2003, which claims priority from U.S. provisional patent application Ser. No. 60/372,048, filed on Apr. 12, 2002, (68) U.S. patent application Ser. No. 10/331,718, filed on Dec. 30, 2002, which is a divisional U.S. patent application Ser. No. 09/679,906, filed on Oct. 5, 2000, which claims priority from provisional patent application Ser. No. 60/159,033, filed on Oct. 12, 1999, (69) PCT application US 03/04837, filed on Feb. 29, 2003, which claims priority from U.S. provisional patent application Ser. No. 60/363,829, filed on Mar. 13, 2002, (70) U.S. patent application Ser. No. 10/261,927, filed on Oct. 1, 2002, now U.S. Pat. No. 7,077,213 which issued Jul. 18, 2006, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (71) U.S. patent application Ser. No. 10/262,008, filed on Oct. 1, 2002, now U.S. Pat. No. 7,036,582 which issued May 2, 2006, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (72) U.S. patent application Ser. No. 10/261,925, filed on Oct. 1, 2002, now U.S. Pat. No. 7,044,218 which issued May 16, 2006, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (73) U.S. patent application Ser. No. 10/199,524, filed on Jul. 19, 2002, which is a continuation of U.S. Pat. No. 6,497,289, which was filed as U.S. patent application Ser. No. 09/454,139, filed on Dec. 3, 1999, which claims priority from provisional application 60/111,293, filed on Dec. 7, 1998, (74) PCT application US 03/10144, filed on Mar. 28, 2003, which claims priority from U.S. provisional patent application Ser. No. 60/372,632, filed on Apr. 15, 2002, (75) U.S. provisional patent application Ser. No. 60/412,542, filed on Sep. 20, 2002, (76) PCT application US 03/14153, filed on May 6, 2003, which claims priority from U.S. provisional patent application Ser. No. 60/380,147, filed on May 6, 2002, (77) PCT application US 03/19993, filed on Jun. 24, 2003, which claims priority from U.S. provisional patent application Ser. No. 60/397,284, filed on Jul. 19, 2002, (78) PCT application US 03/13787, filed on May 5, 2003, which claims priority from U.S. provisional patent application Ser. No. 60/387,486, filed on Jun. 10, 2002, (79) PCT application US 03/18530, filed on Jun. 11, 2003, which claims priority from U.S. provisional patent application Ser. No. 60/387,961, filed on Jun. 12, 2002, (80) PCT application US 03/20694, filed on Jul. 1, 2003, 25791.110.02, which claims priority from U.S. provisional patent application Ser. No. 60/398,061, filed on Jul. 24, 2002, (81) PCT application US 03/20870, filed on Jul. 2, 2003, which claims priority from U.S. provisional patent application Ser. No. 60/399,240, filed on Jul. 29, 2002, (82) U.S. provisional patent application Ser. No. 60/412,487, filed on Sep. 20, 2002, (83) U.S. provisional patent application Ser. No. 60/412,488, filed on Sep. 20, 2002, (84) U.S. patent application Ser. No. 10/280,356, filed on Oct. 25, 2002, which is a continuation of U.S. Pat. No. 6,470,966, which was filed as patent application Ser. No. 09/850,093, filed on May 7, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (85) U.S. provisional patent application Ser. No. 60/412,177, filed on Sep. 20, 2002, (86) U.S. provisional patent application Ser. No. 60/412,653, filed on Sep. 20, 2002, (87) U.S. provisional patent application Ser. No. 60/405,610, filed on Aug. 23, 2002, (88) U.S. provisional patent application Ser. No. 60/405,394, filed on Aug. 23, 2002, (89) U.S. provisional patent application Ser. No. 60/412,544, filed on Sep. 20, 2002, (90) PCT application US 03/24779, filed on Aug. 8, 2003, which claims priority from U.S. provisional patent application Ser. No. 60/407,442, filed on Aug. 30, 2002, (91) U.S. provisional patent application Ser. No. 60/423,363, filed on Dec. 10, 2002, (92) U.S. provisional patent application Ser. No. 60/412,196, filed on Sep. 20, 2002, (93) U.S. provisional patent application Ser. No. 60/412,187, filed on Sep. 20, 2002, (94) U.S. provisional patent application Ser. No. 60/412,371, filed on Sep. 20, 2002, (95) U.S. patent application Ser. No. 10/382,325, filed on Mar. 5, 2003, which is a continuation of U.S. Pat. No. 6,557,640, which was filed as patent application Ser. No. 09/588,946, filed on Jun. 7, 2000, which claims priority from provisional application 60/137,998, filed on Jun. 7, 1999, (96) U.S. patent application Ser. No. 10/624,842, filed on Jul. 22, 2003, which is a divisional of U.S. patent application Ser. No. 09/502,350, filed on Feb. 10, 2000, now U.S. Pat. No. 6,823,937 which issued Nov. 30, 2004, which claims priority from provisional application 60/119,611, filed on Feb. 11, 1999, (97) U.S. provisional patent application Ser. No. 60/431,184, filed on Dec. 5, 2002, (98) U.S. provisional patent application Ser. No. 60/448,526, filed on Feb. 18, 2003, (99) U.S. provisional patent application Ser. No. 60/461,539, filed on Apr. 9, 2003, (100) U.S. provisional patent application Ser. No. 60/462,750, filed on Apr. 14, 2003, (101) U.S. provisional patent application Ser. No. 60/436,106, filed on Dec. 23, 2002, (102) U.S. provisional patent application Ser. No. 60/442,942, filed on Jan. 27, 2003, (103) U.S. provisional patent application Ser. No. 60/442,938, filed on Jan. 27, 2003, (104) U.S. patent application Ser. No. 10/418,687, filed on Apr. 18, 2003, now U.S. Pat. No. 7,021,390 which issued Apr. 4, 2006, (105) U.S. provisional patent application Ser. No. 60/454,896, filed on Mar. 14, 2003, (106) U.S. provisional patent application Ser. No. 60/450,504, filed on Feb. 26, 2003, (107) U.S. provisional patent application Ser. No. 60/451,152, filed on Mar. 9, 2003, (108) U.S. provisional patent application Ser. No. 60/455,124, filed on Mar. 17, 2003, (109) U.S. provisional patent application Ser. No. 60/453,678, filed on Mar. 11, 2003, (110) U.S. patent application Ser. No. 10/421,682, filed on Apr. 23, 2003, which is a continuation of U.S. patent application Ser. No. 09/523,468, 25791.11.02, filed on Mar. 10, 2000, (now U.S. Pat. No. 6,640,903 which issued Nov. 4, 2003), which claims priority from provisional application 60/124,042, filed on Mar. 11, 1999, (111) U.S. provisional patent application Ser. No. 60/457,965, filed on Mar. 27, 2003, (112) U.S. provisional patent application Ser. No. 60/455,718, filed on Mar. 18, 2003, (113) U.S. Pat. No. 6,550,821, which was filed as patent application Ser. No. 09/811,734, filed on Mar. 19, 2001, (114) U.S. patent application Ser. No. 10/436,467, filed on May 12, 2003, now U.S. Pat. No. 6,968,618 which issued Nov. 29, 2005, which is a continuation of U.S. Pat. No. 6,604,763, which was filed as application Ser. No. 09/559,122, filed on Apr. 26, 2000, which claims priority from provisional application 60/131,106, filed on Apr. 26, 1999, (115) U.S. provisional patent application Ser. No. 60/459,776, filed on Apr. 2, 2003, (116) U.S. provisional patent application Ser. No. 60/461,094, filed on Apr. 8, 2003, (117) U.S. provisional patent application Ser. No. 60/461,038, filed on Apr. 7, 2003, (118) U.S. provisional patent application Ser. No. 60/463,586, filed on Apr. 17, 2003, (119) U.S. provisional patent application Ser. No. 60/472,240, filed on May 20, 2003, (120) U.S. patent application Ser. No. 10/619,285, filed on Jul. 14, 2003, which is a continuation-in-part of U.S. utility patent application Ser. No. 09/969,922, filed on Oct. 3, 2001, (now U.S. Pat. No. 6,634,431 which issued Oct. 21, 2003), which is a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (121) U.S. utility patent application Ser. No. 10/418,688, now U.S. Pat. No. 7,055,608 which issued Jun. 6, 2006, which was filed on Apr. 18, 2003, as a division of U.S. utility patent application Ser. No. 09/523,468, filed on Mar. 10, 2000, (now U.S. Pat. No. 6,640,903 which issued Nov. 4, 2003), which claims priority from provisional application 60/124,042, filed on Mar. 11, 1999; (122) PCT patent application Ser. no. PCT/US2004/06246, 25791.238.02, filed on Feb. 26, 2004; (123) PCT patent application Ser. No. PCT/US2004/08170, filed on Mar. 15, 2004; (124) PCT patent application Ser. No. PCT/US2004/08171, filed on Mar. 15, 2004; (125) PCT patent application Ser. No. PCT/US2004/08073, filed on Mar. 18, 2004; (126) PCT patent application Ser. No. PCT/US2004/07711, filed on Mar. 11, 2004; (127) PCT patent application Ser. No. PCT/US2004/029025, filed on Mar. 26, 2004; (128) PCT patent application Ser. No. PCT/US2004/010317, filed on Apr. 2, 2004; (129) PCT patent application Ser. No. PCT/US2004/010712, filed on Apr. 6, 2004; (130) PCT patent application Ser. No. PCT/US2004/010762, filed on Apr. 6, 2004; (131) PCT patent application Ser. No. PCT/US2004/011973, filed on Apr. 15, 2004; (132) U.S. provisional patent application Ser. No. 60/495056, filed on Aug. 14, 2003; (133) U.S. provisional patent application Ser. No. 60/600679, filed on Aug. 11, 2004; (134) PCT patent application Ser. No. PCT/US2005/027318, filed on Jul. 29, 2005; (135) PCT patent application Ser. No. PCT/US2005/028936, filed on Aug. 12, 2005; (136) PCT patent application Ser. No. PCT/US2005/028669, filed on Aug. 11, 2005; (137) PCT patent application Ser. No. PCT/US2005/028453, filed on Aug. 11, 2005; (138) PCT patent application Ser. No. PCT/US2005/028641, filed on Aug. 11, 2005; (139) PCT patent application Ser. No. PCT/US2005/028819, filed on Aug. 11, 2005; (140) PCT patent application Ser. No. PCT/US2005/028446, filed on Aug. 11, 2005; (141) PCT patent application Ser. No. PCT/US2005/028642, filed on Aug. 11, 2005; (142) PCT patent application Ser. No. PCT/US2005/028451, 25791.376, filed on Aug. 11, 2005, and (143). PCT patent application Ser. No. PCT/US2005/028473, filed on Aug. 11, 2005, (144) U.S. utility patent application Ser. No. 10/546,082, filed on Aug. 16, 2005, (145) U.S. utility patent application Ser. No. 10/546,076, filed on Aug. 16, 2005, (146) U.S. utility patent application Ser. No. 10/545,936, filed on Aug. 16, 2005, (147) U.S. utility patent application Ser. No. 10/546,079, filed on Aug. 16, 2005(148) U.S. utility patent application Ser. No. 10/545,941, filed on Aug. 16, 2005, (149) U.S. utility patent application Ser. No. 546,078, filed on Aug. 16, 2005, filed on Aug. 11, 2005., (150) U.S. utility patent application Ser. No.

10/545,941, filed on Aug. 16, 2005, (151) U.S. utility patent application Ser. No. 11/249,967, filed on Oct. 13, 2005, (152) U.S. provisional patent application Ser. No. 60/734302, filed on Nov. 7, 2005, (153) U.S. provisional patent application Ser. No. 60/725181, filed on Oct. 11, 2005, (154) PCT patent application Ser. No. PCT/US2005/023391, filed Jun. 29, 2005which claims priority from U.S. provisional patent application Ser. No. 60/585370, filed on Jul. 2, 2004, (155) U.S. provisional patent application Ser. No. 60/721579, filed on Sep. 28, 2005, (156) U.S. provisional patent application Ser. No. 60/717391, filed on Sep. 15, 2005, (157) U.S. provisional patent application Ser. No. 60/702935, filed on Jul. 27, 2005, (158) U.S. provisional patent application Ser. No. 60/663,913, 25791.32, filed on Mar. 21, 2005, (159) U.S. provisional patent application Ser. No. 60/652564, docket No. 25791.348, filed on Feb. 14, 2005, (160) U.S. provisional patent application Ser. No. 60/645840, filed on Jan. 21, 2005, (161) PCT patent application Ser. No. PCT/US2005/043122, filed on Nov. 29, 2005which claims priority from U.S. provisional patent application Ser. No. 60/631703, filed on Nov. 30, 2004, (162) U.S. provisional patent application Ser. No. 60/752787, filed on Dec. 22, 2005, (163) U.S. National Stage application Ser. No. 10/548,934, filed on Sep. 12, 2005; (164) U.S. National Stage application Ser. No. 10/549,410, filed on Sep. 13, 2005; (165) U.S. Provisional Patent Application No. 60/717391, filed on Sep. 15, 2005; (166) U.S. National Stage application Ser. No. 10/550,906, filed on Sep. 27, 2005; (167) U.S. National Stage application Ser. No. 10/551,880, filed on Sep. 30, 2005; (168) U.S. National Stage application Ser. No. 10/552,253, filed on Oct. 4, 2005; (169) U.S. National Stage application Ser. No. 10/552,790, filed on Oct. 11, 2005; (170) U.S. Provisional Patent Application No. 60/725181, filed on Oct. 11, 2005; (171) U.S. National Stage application Ser. No. 10/553,094, filed on Oct. 13, 2005; (172) U.S. National Stage application Ser. No. 10/553,566, filed on Oct. 17, 2005; (173) PCT Patent Application No. PCT/US2006/002449, filed on Jan. 20, 2006, (174) PCT Patent Application No. PCT/US2006/004809, filed on Feb. 9, 2006; (175) U.S. Utility patent application Ser. No. 11/356,899, filed on Feb. 17, 2006, (176) U.S. National Stage application Ser. No. 10/568,200, filed on Feb. 13, 2006, (177) U.S. National Stage application Ser. No. 10/568,719, filed on Feb. 16, 2006, filed on Feb. 16, 2006, (178) U.S. National Stage application Ser. No. 10/569,323, filed on Feb. 17, 2006, (179) U.S. National State patent application Ser. No. 10/571,041, filed on Mar. 3, 2006; (180) U.S. National State patent application Ser. No. 10/571,017, filed on Mar. 3, 2006; (181) U.S. National State patent application Ser. No. 10/571,086, filed on Mar. 6, 2006; and (182) U.S. National State patent application Ser. No. 10/571,085, filed on Mar. 6, 2006, (183) U.S. utility patent application Ser. No. 10/938,788, filed on Sep. 10, 2004, (184) U.S. utility patent application Ser. No. 10/938,225, filed on Sep. 10, 2004, (185) U.S. utility patent application Ser. No. 10/952,288, filed on Sep. 28, 2004, (186) U.S. utility patent application Ser. No. 10/952,416, filed on Sep. 28, 2004, (187) U.S. utility patent application Ser. No. 10/950,749, filed on Sep. 27, 2004, (188) U.S. utility patent application Ser. No. 10/950,869, filed on Sep. 27, 2004; (189) U.S. provisional patent application Ser. No. 60/761324, filed on Jan. 23, 2006, (190) U.S. provisional patent application Ser. No. 60/754,556, filed on Dec. 28, 2005, (191) U.S. utility patent application Ser. No. 11/380,051, filed on Apr. 25, 2006, (192) U.S. utility patent application Ser. No. 11/380,055, filed on Apr. 25, 2006, (193) U.S. utility patent application Ser. No. 10/522,039, filed on Mar. 10, 2006; (194) U.S. provisional patent application Ser. No. 60/746,813, filed on May 9, 2006; (195) U.S. utility patent application Ser. No. 11/456,584, filed on Jul. 11, 2006; and (196) U.S. utility patent application Ser. No. 11/456,587, filed on Jul. 11, 2006; (197) PCT Patent Application No. PCT/US2006/009886, filed on Mar. 21, 2006; (198) PCT Patent Application No. PCT/US2006/010674, filed on Mar. 21, 2006; (199) U.S. Pat. No. 6,409,175 which issued Jun. 25, 2002, (200) U.S. Pat. No. 6,550,821 which issued Apr. 22, 2003, (201) U.S. patent application Ser. No. 10/767,953, filed Jan. 29, 2004, now U.S. Pat. No. 7,077,211 which issued Jul. 18, 2006; (202) U.S. patent application Ser. No. 10/769,726, filed Jan. 30, 2004, (203) U.S. patent application Ser. No. 10/770,363 filed Feb. 2, 2004, (204) U.S. utility patent application Ser. No. 11/068,595, filed on Feb. 28, 2005; (205) U.S. utility patent application Ser. No. 11/070,147, filed on Mar. 2, 2005; (206) U.S. utility patent application Ser. No. 11/071,409, filed on Mar. 2, 2005; (207) U.S. utility patent application Ser. No. 11/071,557, filed on Mar. 3, 2005; (208) U.S. utility patent application Ser. No. 11/072,578, filed on Mar. 4, 2005; (209) U.S. utility patent application Ser. No. 11/072,893, filed on Mar. 4, 2005; (210) U.S. utility patent application Ser. No. 11/072,594, filed on Mar. 4, 2005; (211) U.S. utility patent application Ser. No. 11/074,366, filed on Mar. 7, 2005; and (212) U.S. utility patent application Ser. No. 11/074,266, filed on Mar. 7, 2005, the disclosures of which are incorporated herein by reference.

BACKGROUND OF THE INVENTION

The invention relates generally to oil and gas exploration, and in particular to forming and repairing wellbore casings to facilitate oil and gas exploration.

BRIEF DESCRIPTION OF THE DRAWINGS

FIGS. 11-1 and 11-2, 11A1 to 11A2, 11B1 to 11B2, 11C, 11D, 11E, 11F, 11G, 11H, 11I, 11j, 11K, 11L, 11M, 11N, 11O, 11P, 11Q, 11R, 11S, 11T, 11U, 11V, 11W, 11X, 11Y, 11Z1 to 11Z4, 11AA1 to 11AA4, 11AB1 to 11AB4, 11AC1 to 11AC4, 11AD, and 11AE are fragmentary cross-sectional and perspective illustrations of an exemplary embodiment of a casing cutter assembly.

FIGS. 12A1 to 12A4 and 12C1 to 12C4 are fragmentary cross-sectional illustrations of an exemplary embodiment of a ball gripper assembly.

FIG. 12B is a top view of a portion of the ball gripper assembly of FIGS. 12A1 to 12A4 and 12C1 to 12C4.

FIGS. 13A1 to 13A8 and 13B1 to 13B7 are fragmentary cross-sectional illustrations of an exemplary embodiment of a tension actuator assembly.

FIGS. 14A, 14B and 14C are fragmentary cross-sectional and perspective illustrations of an exemplary embodiment of a cup seal assembly.

FIGS. 15-1, 15-2, 15A1, 15A2, 15B1, 15B2, 15C1, 15C2, 15D, 15E1 to 15E5, 15F1 to 15F5, and 15G1 to 15G5 are fragmentary cross sectional illustrations of an exemplary embodiment of an extension actuator and casing lock assembly.

FIGS. 16-1 and 16-2, 16A1 to 16A2, 16B1 to 16B2, 16C, 16D, 16E, 16F, 16G, 16H, 16I, **16*j*, 16K, 16L, 16M, 16N, 16O, 16P, 16R, 16S, 16T, 16U, 16V, 16W, 16X, 16Y, 16Z1 to 16Z4, 16AA1 to 16AA4, 16AB1 to 16AB4, 16AC1 to 16AC4, 16AD, and 16AE** are fragmentary cross-sectional and perspective illustrations of an exemplary embodiment of an adjustable bell section expansion cone assembly.

FIGS. 17-1 and 17-2, 17A1 to 17A2, 17B1 to 17B2, 17C, 17D, 17E, 17F, 17G, 17H, 17I, **17*j*, 17K, 17L, 17M, 17N, 17O, 17P, 17R, 17S, 17T, 17U, 17V, 17W, 17X, 17Y, 17Z1-17Z4, 17AA1 to 17AA4, 17AB1 to 17AB4, 17AC1 to 17AC4, 17AD, and 17AE** are fragmentary cross-sectional and perspective illustrations of an exemplary embodiment of an adjustable casing expansion cone assembly.

FIGS. 19-1 to 19-5 is a fragmentary cross-sectional illustration of an exemplary embodiment of a packer assembly.

FIGS. 20A1 to 20A5, 20B1 to 20B5, 20C1 to 20C5, 20D1 to 20D5, 20E1 to 20E6, 20F1 to 20F6, 20G1 to 20G6, and 20H1 to 20H5, are fragmentary cross-sectional illustrations of an exemplary embodiment of the operation of the packer setting tool assembly of FIGS. 18A to 18C and the packer assembly of FIGS. 19-1 to 19-5.

Figure 45:
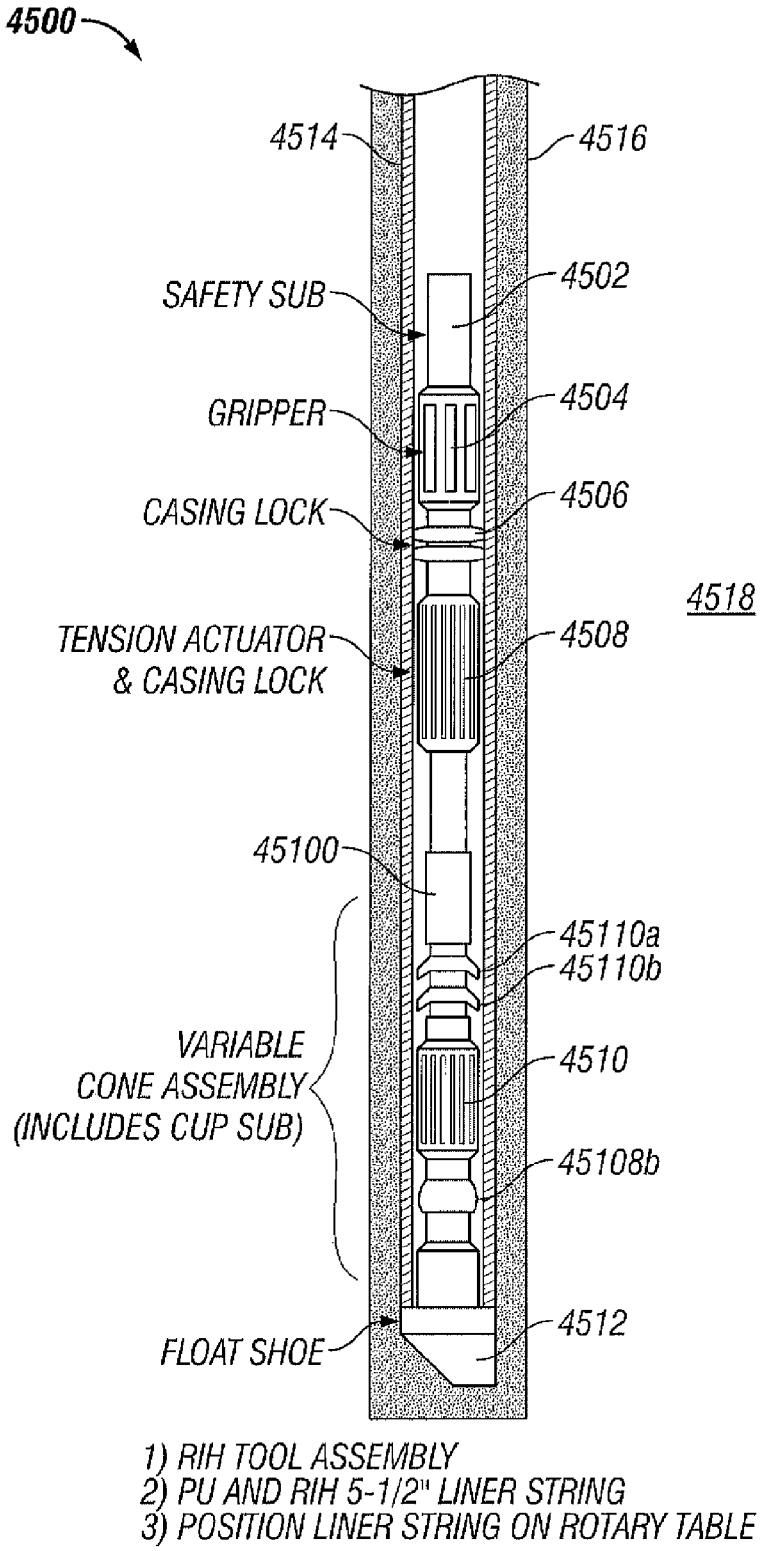
FIG. 45 is a fragmentary cross sectional view of an exemplary embodiment of a system for radially expanding and plastically deforming a wellbore casing.
Figure 45A:
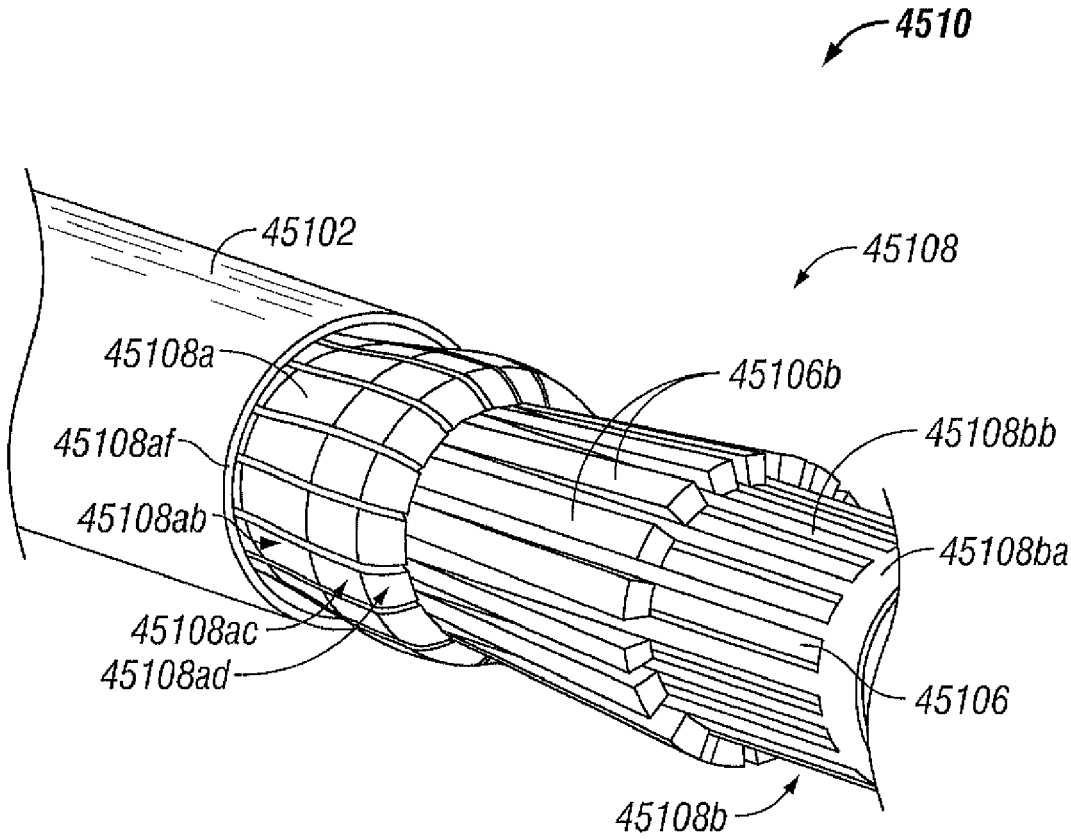
Figure 45B:
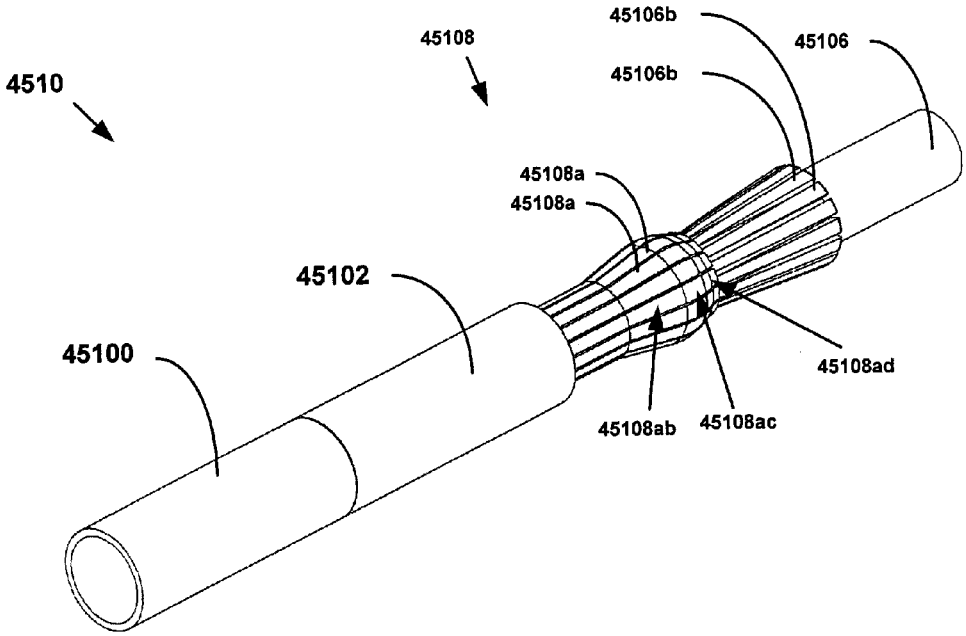
Figure 45C:
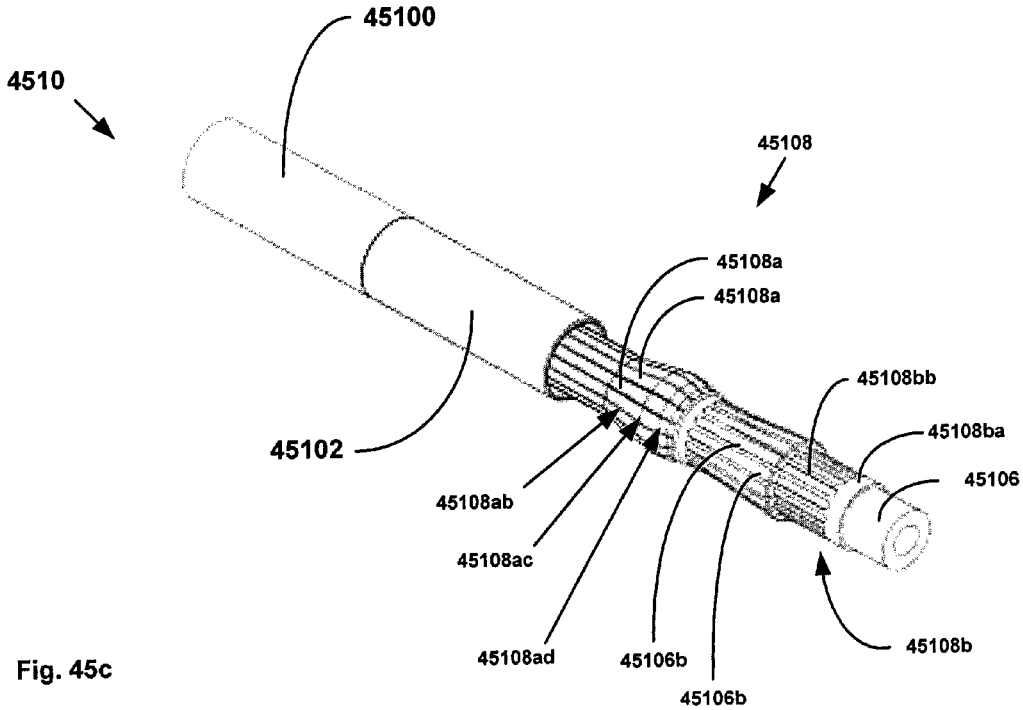

FIGS. **45*a*, 45*b*, and 45*c* are perspective views of an exemplary embodiment of the adjustable expansion device of the system of FIG. 45**.

FIG. **45*d* is a cross-sectional view of an exemplary embodiment of the adjustable expansion device of the system of FIG. 45**.

Figure 45D:
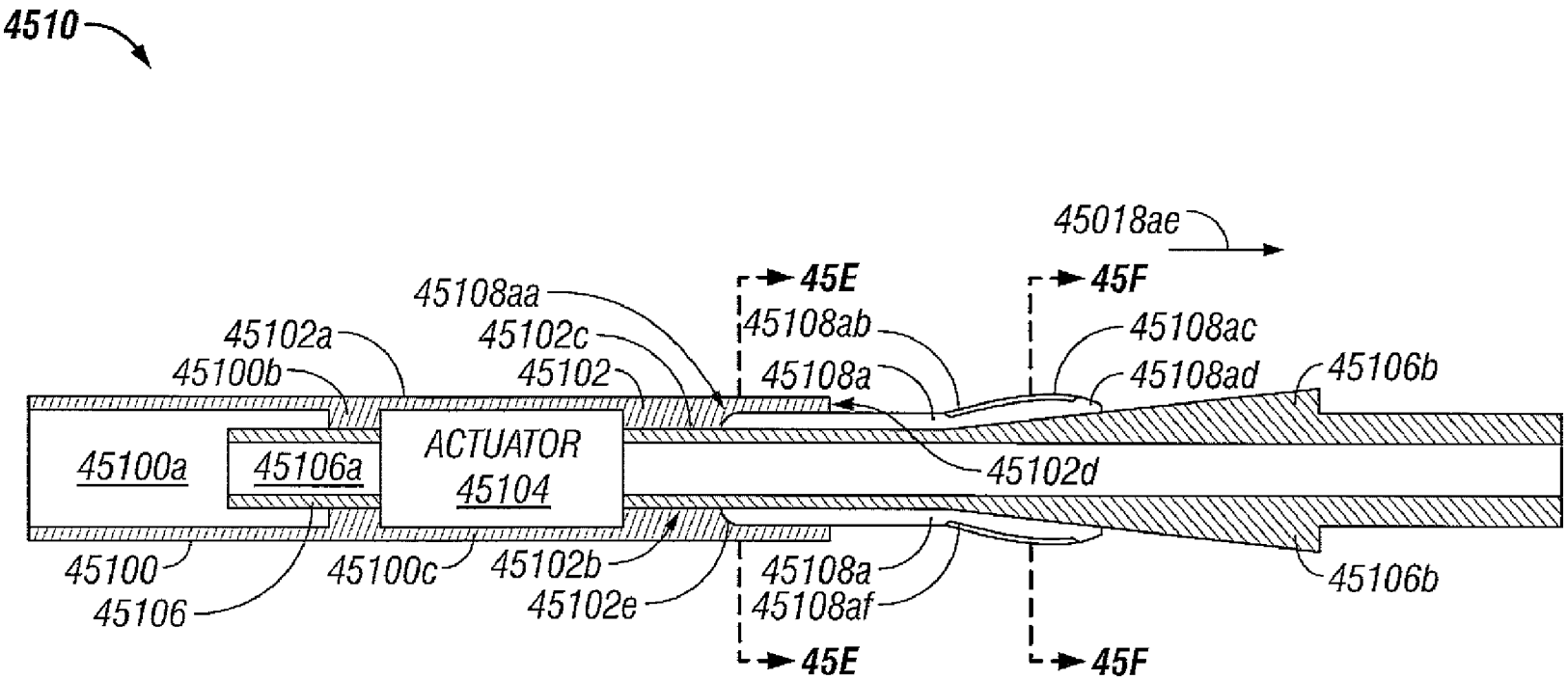
Figure 45E:
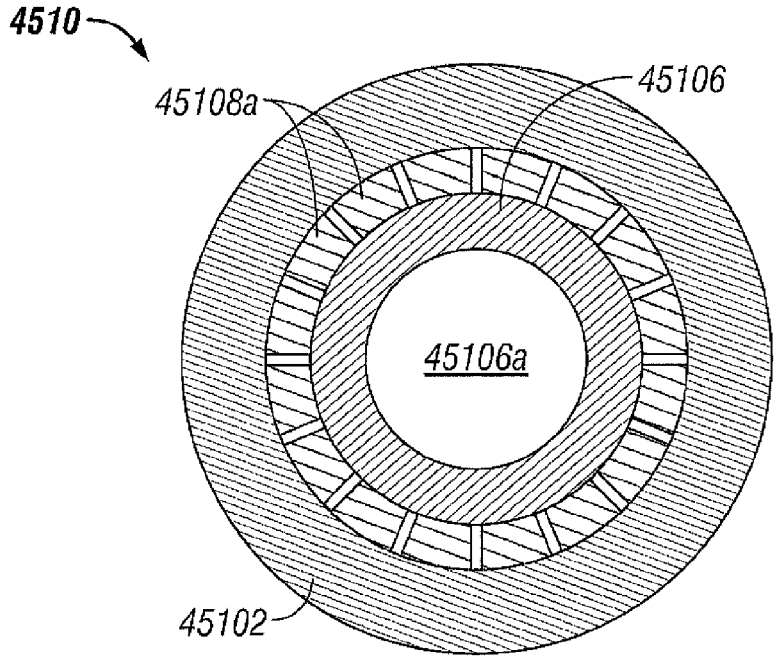
Figure 45F:
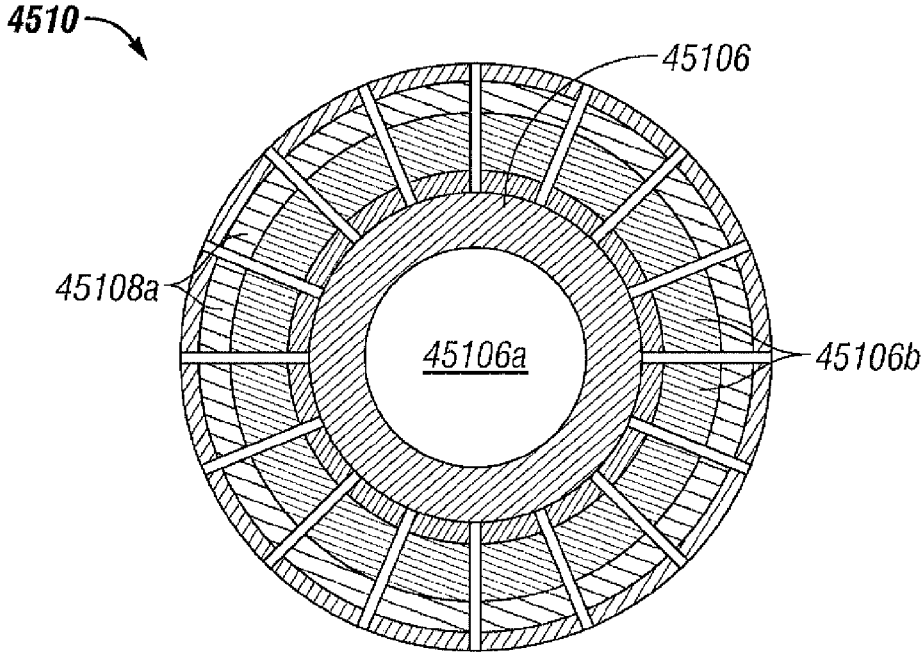

FIGS. **45*e* and 45*f* are cross-sectional views of the adjustable expansion device of FIG. 45*d***.

FIGS. 46 to 51 are fragmentary cross sectional views of the system for radially expanding and plastically deforming a wellbore casing of FIG. 45 during continued operation.

Figure 51:
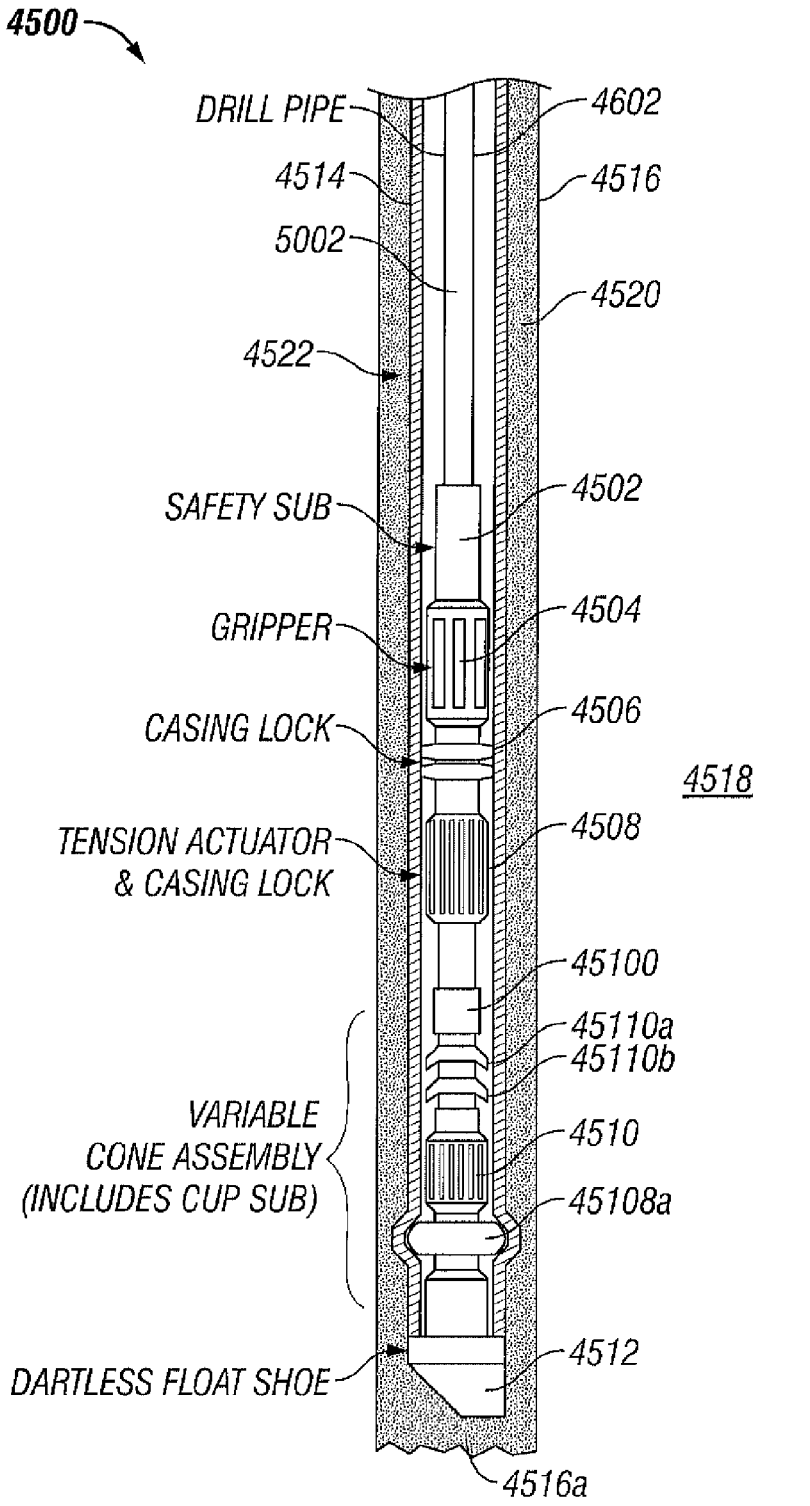
Figure 51A:
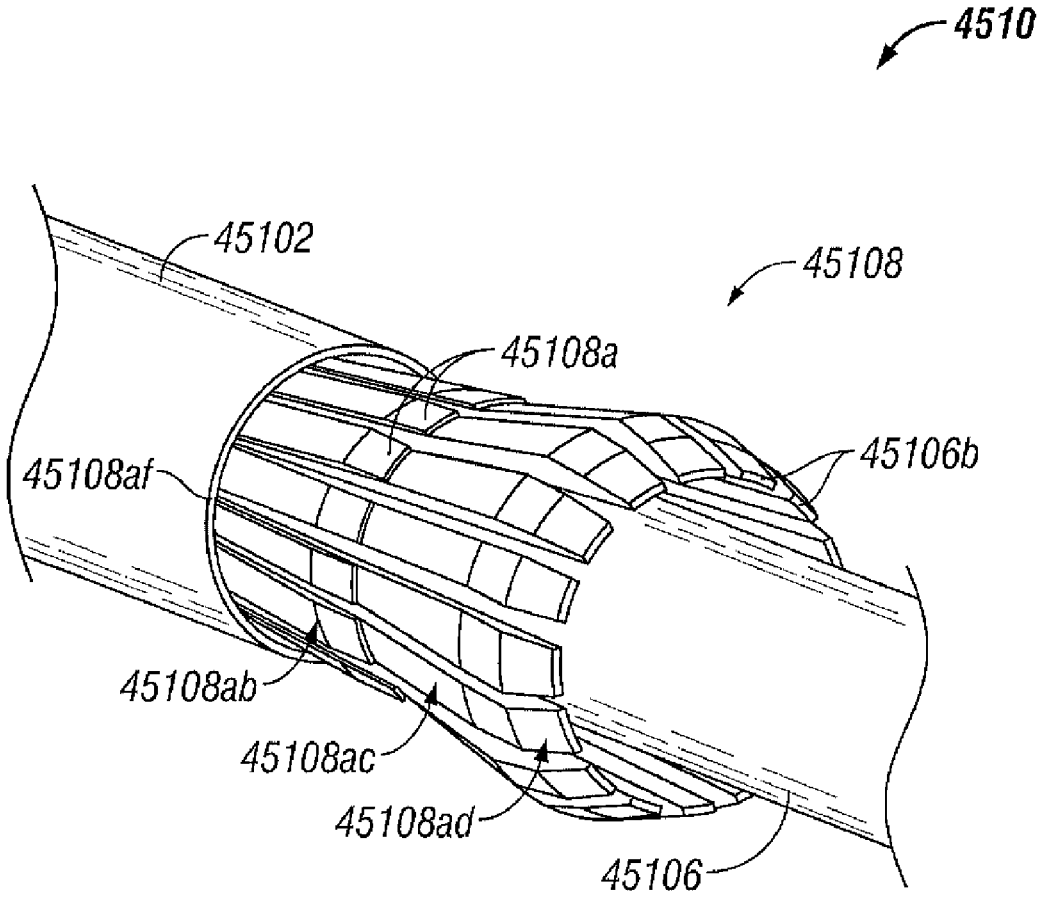
Figure 51B:
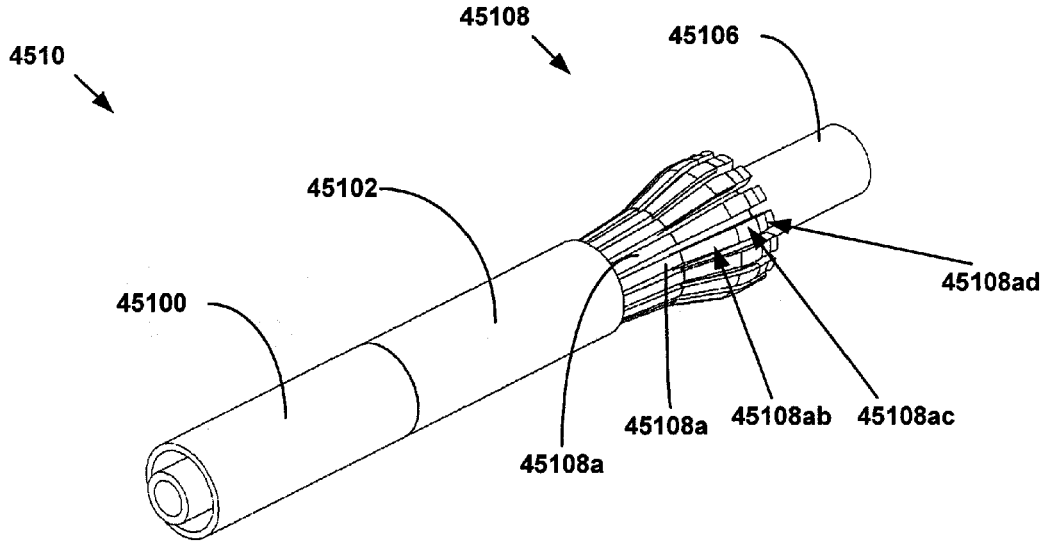
Figure 51C:
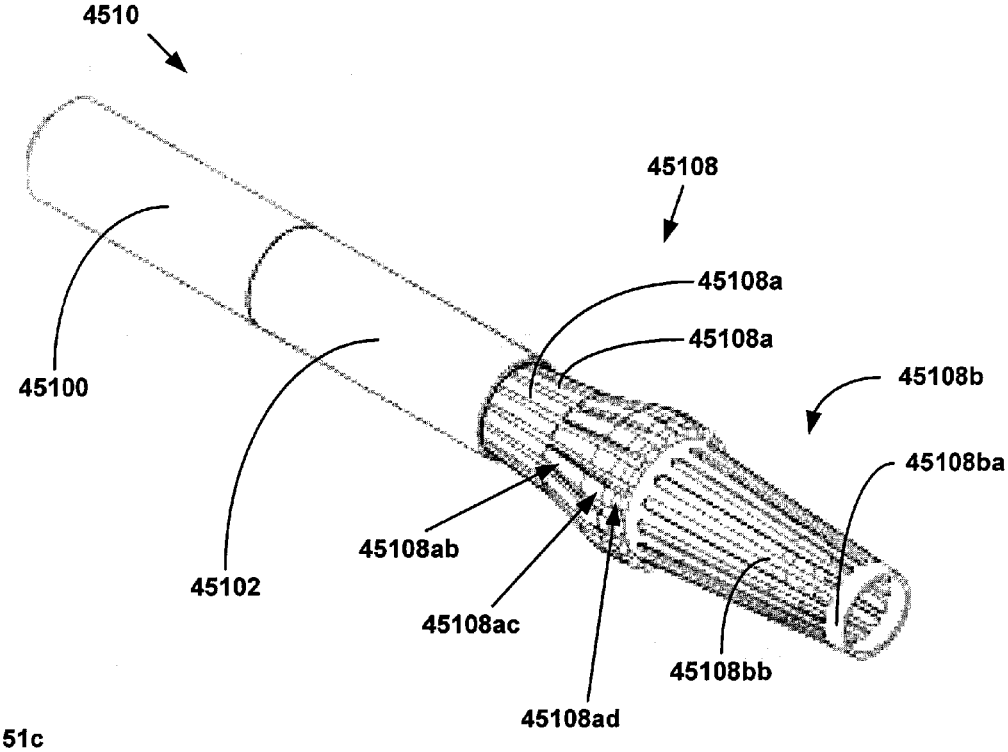

FIGS. 51*a*, 51*b*, and 51*c* are perspective views of an exemplary embodiment of the adjustable expansion device of the system of FIG. 51.

Figure 51D:
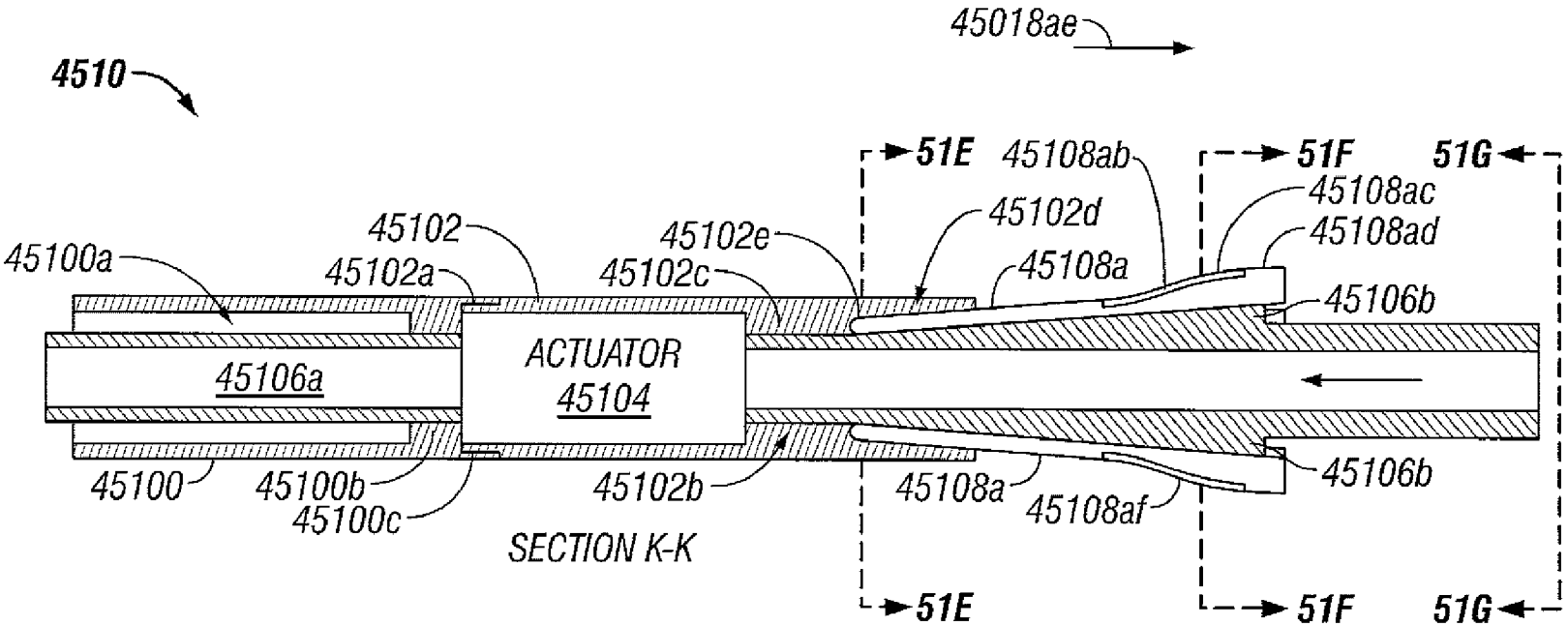

FIG. 51*d* is a cross-sectional view of an exemplary embodiment of the adjustable expansion device of the system of FIG. 51.

FIGS. 51*e*, 51*f* and 51*g* are cross-sectional views of the adjustable expansion device of FIG. 51*d*.

Figure 52:
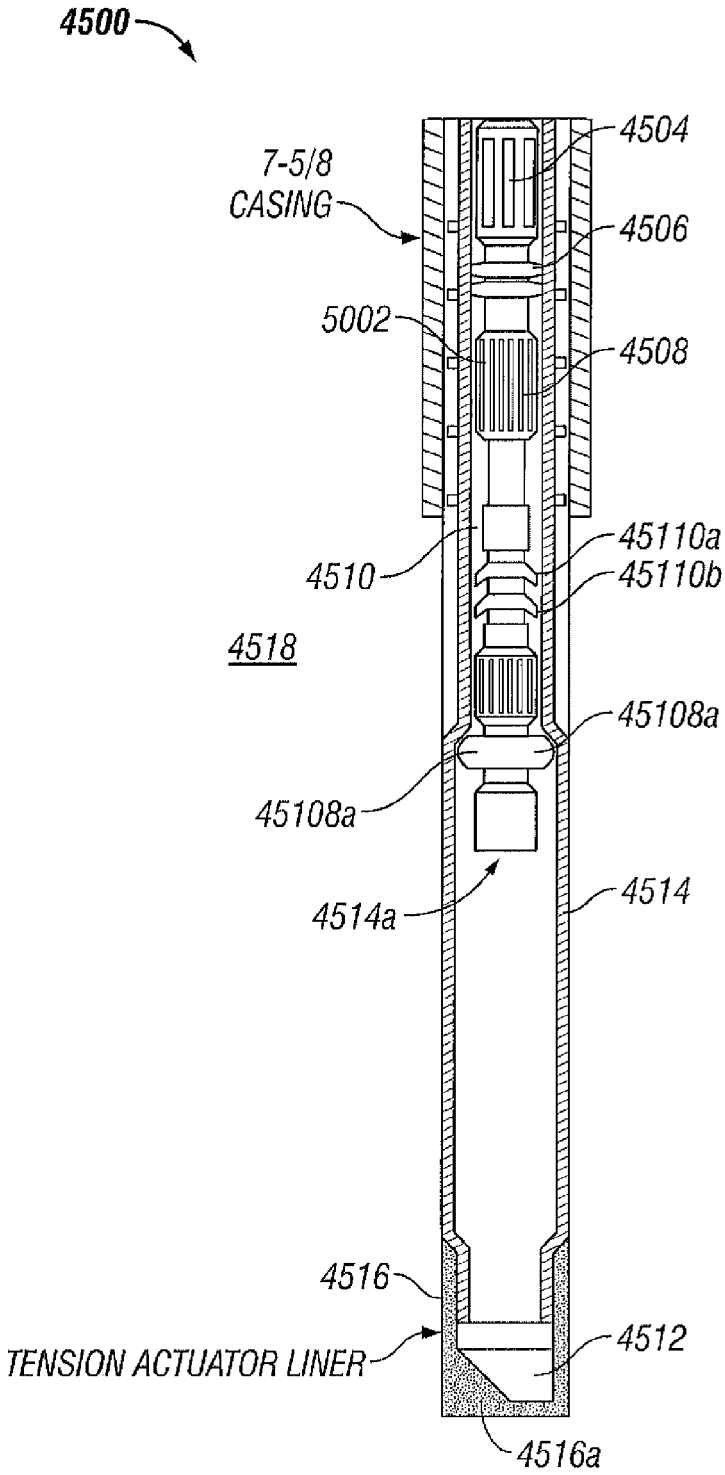

FIG. 52 is a fragmentary cross sectional view of the system for radially expanding and plastically deforming a wellbore casing of FIG. 51 during continued operation.

Figure 53:
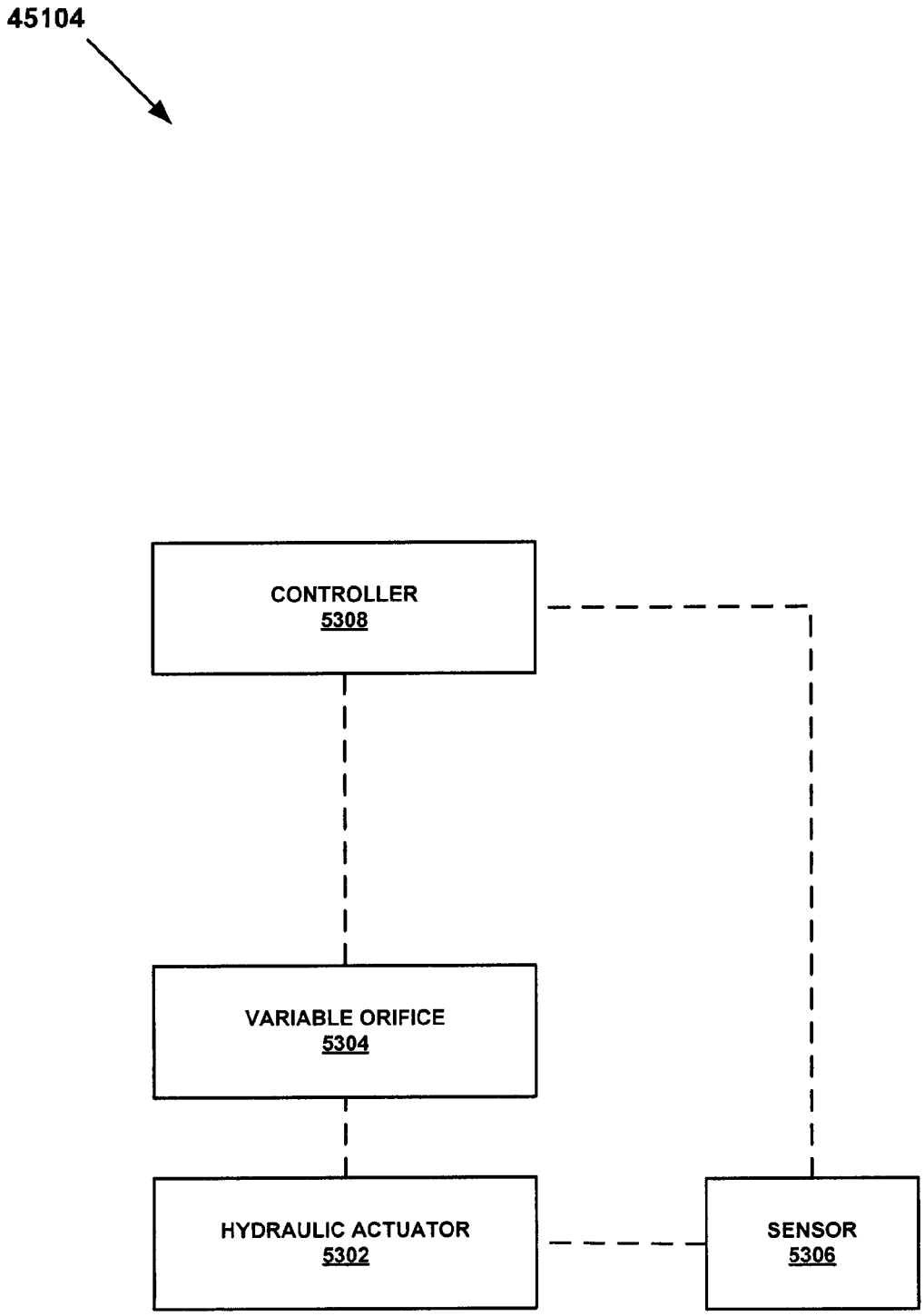

FIG. 53 is a schematic illustration of an exemplary embodiment of an adjustable expansion device.

DETAILED DESCRIPTION OF THE ILLUSTRATIVE EMBODIMENTS

Referring initially to FIGS. 1-10, an exemplary embodiment of a system 10 for radially expanding and plastically deforming a wellbore casing includes a conventional tubular support 12 having an end that is coupled to an end of a casing cutter assembly 14. In an exemplary embodiment, the casing cutter assembly 14 may be, or may include elements, of one or more conventional commercially available casing cutters for cutting wellbore casing, or equivalents thereof.

An end of a ball gripper assembly 16 is coupled to another end of the casing cutter assembly 14. In an exemplary embodiment, the ball gripper assembly 14 may be, or may include elements, of one or more conventional commercially available ball grippers, or other types of gripping devices, for gripping wellbore casing, or equivalents thereof.

An end of a tension actuator assembly 18 is coupled to another end of the ball gripper assembly 16. In an exemplary embodiment, the tension actuator assembly 18 may be, or may include elements, of one or more conventional commercially actuators, or equivalents thereof.

An end of a safety sub assembly 20 is coupled to another end of the tension actuator assembly 18. In an exemplary embodiment, the safety sub assembly 20 may be, or may include elements, of one or more conventional apparatus that provide quick connection and/or disconnection of tubular members, or equivalents thereof.

An end of a sealing cup assembly 22 is coupled to another end of the safety sub assembly 20. In an exemplary embodiment, the sealing cup assembly 22 may be, or may include elements, of one or more conventional sealing cup assemblies, or other types of sealing assemblies, that sealingly engage the interior surfaces of surrounding tubular members, or equivalents thereof.

An end of a casing lock assembly 24 is coupled to another end of the sealing cup assembly 22. In an exemplary embodiment, the casing lock assembly 24 may be, or may include elements, of one or more conventional casing lock assemblies that lock the position of wellbore casing, or equivalents thereof.

An end of an extension actuator assembly 26 is coupled to another end of the casing lock assembly 24. In an exemplary embodiment, the extension actuator assembly 26 may be, or may include elements, of one or more conventional actuators, or equivalents thereof.

An end of an adjustable bell section expansion cone assembly 28 is coupled to another end of the extension actuator assembly 26. In an exemplary embodiment, the adjustable bell section expansion cone assembly 28 may be, or may include elements, of one or more conventional adjustable expansion devices for radially expanding and plastically deforming wellbore casing, or equivalents thereof.

An end of an adjustable casing expansion cone assembly 30 is coupled to another end of the adjustable bell section expansion cone assembly 28. In an exemplary embodiment, the adjustable casing expansion cone assembly 30 may be, or may include elements, of one or more conventional adjustable expansion devices for radially expanding and plastically deforming wellbore casing, or equivalents thereof.

An end of a packer setting tool assembly 32 is coupled to another end of the adjustable casing expansion cone assembly 30. In an exemplary embodiment, the packer setting tool assembly 32 may be, or may include elements, of one or more conventional adjustable expansion devices for controlling the operation of a conventional packer, or equivalents thereof.

An end of a stinger assembly 34 is coupled to another end of the packer setting tool assembly 32. In an exemplary embodiment, the stinger assembly 34 may be, or may include elements, of one or more conventional devices for engaging a conventional packer, or equivalents thereof.

An end of a packer control device or packer assembly 36 is coupled to another end of the stinger assembly 34. In an exemplary embodiment, the packer assembly 36 may be, or may include elements, of one or more conventional packers.

In an exemplary embodiment, one or more of the elements of the system 10 may be omitted, at least in part, and/or combined, at least in part, with one or more of the other elements of the system.

Figure 1:
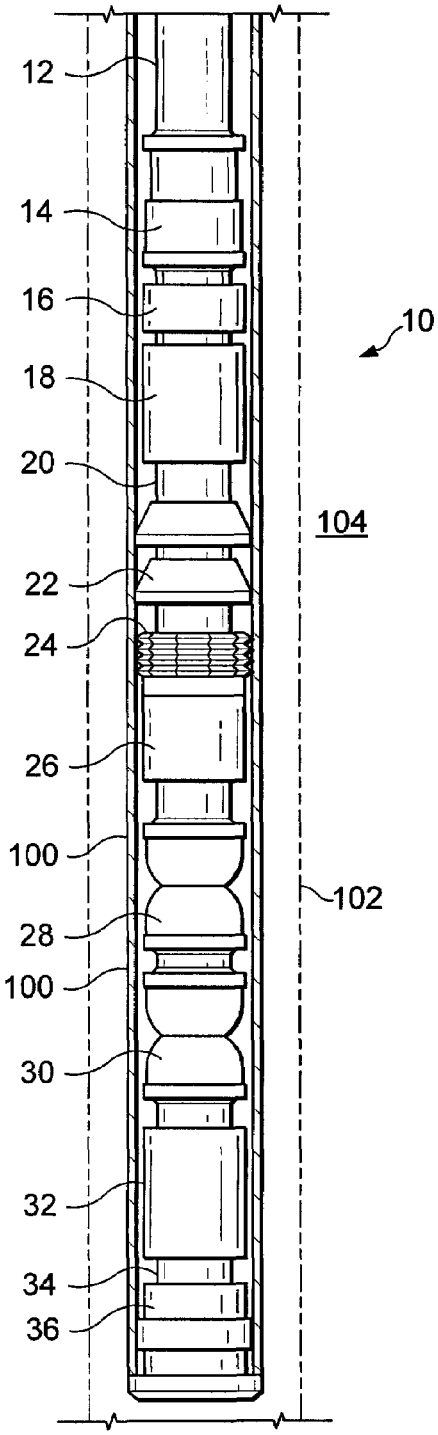
FIG. 1 is a fragmentary cross-sectional illustration of an embodiment of a system for radially expanding and plastically deforming wellbore casing, including a tubular support member, a casing cutter, a ball gripper for gripping a wellbore casing, a force multiplier tension actuator, a safety sub, a cup sub, a casing lock, an extension actuator, a bell section adjustable expansion cone assembly, a casing section adjustable expansion cone assembly, a packer setting tool, a packer, a stinger, and an expandable wellbore casing, during the placement of the system within a wellbore.

As illustrated in FIG. 1, in an exemplary embodiment, during operation of the system 10, an expandable wellbore casing 100 is coupled to and supported by the casing lock assembly 24 of the system. The system 10 is then positioned within a wellbore 102 that traverses a subterranean formation 104 and includes a preexisting wellbore casing 106.

Figure 2:
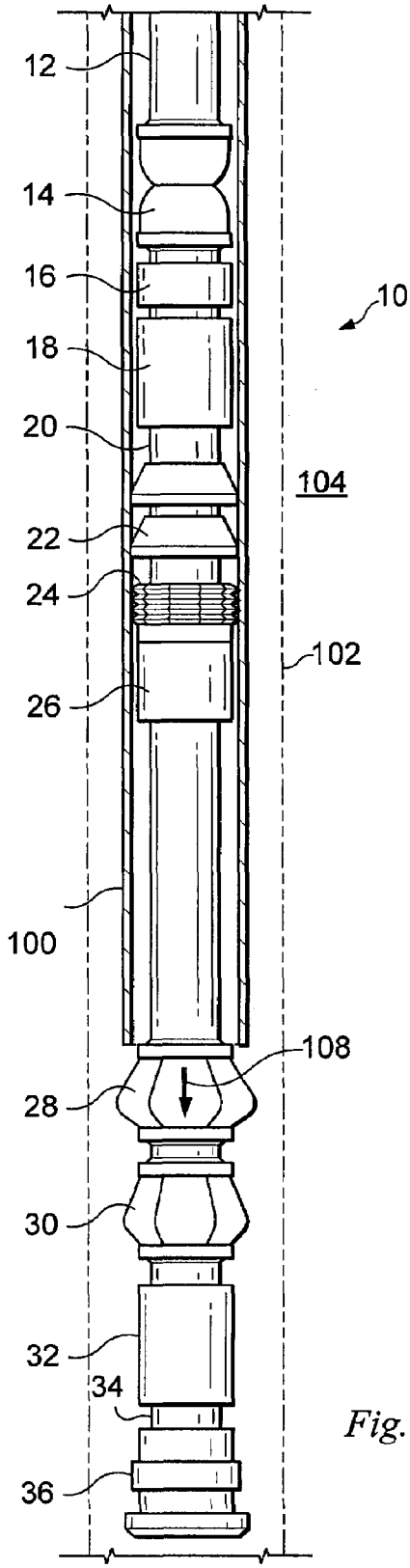
FIG. 2 is a fragmentary cross-sectional illustration of the system of FIG. 1 during the subsequent displacement of the bell section adjustable expansion cone assembly, the casing section adjustable expansion cone assembly, the packer setting tool, the packer, and the stinger downwardly out of the end of the expandable wellbore casing and the expansion of the size of the bell section adjustable expansion cone assembly and the casing section adjustable expansion cone assembly.

As illustrated in FIG. 2, in an exemplary embodiment, the extension actuator assembly 26 is then operated to move the adjustable bell section expansion cone assembly 28, adjustable casing expansion cone assembly 30, packer setting tool assembly 32, stinger assembly 34, packer assembly 36 downwardly in a direction 108 and out of an end of the expandable wellbore casing 100. After the adjustable bell section expansion cone assembly 28 and adjustable casing expansion cone assembly 30 have been moved to a position out of the end of the expandable wellbore casing 100, the adjustable bell section expansion cone assembly and adjustable casing expansion cone assembly are then operated to increase the outside diameters of the expansion cone assemblies. In an exemplary embodiment, the increased outside diameter of the adjustable bell section expansion cone assembly 28 is greater than the increased outside diameter of the adjustable casing expansion cone assembly 30.

Figure 3:
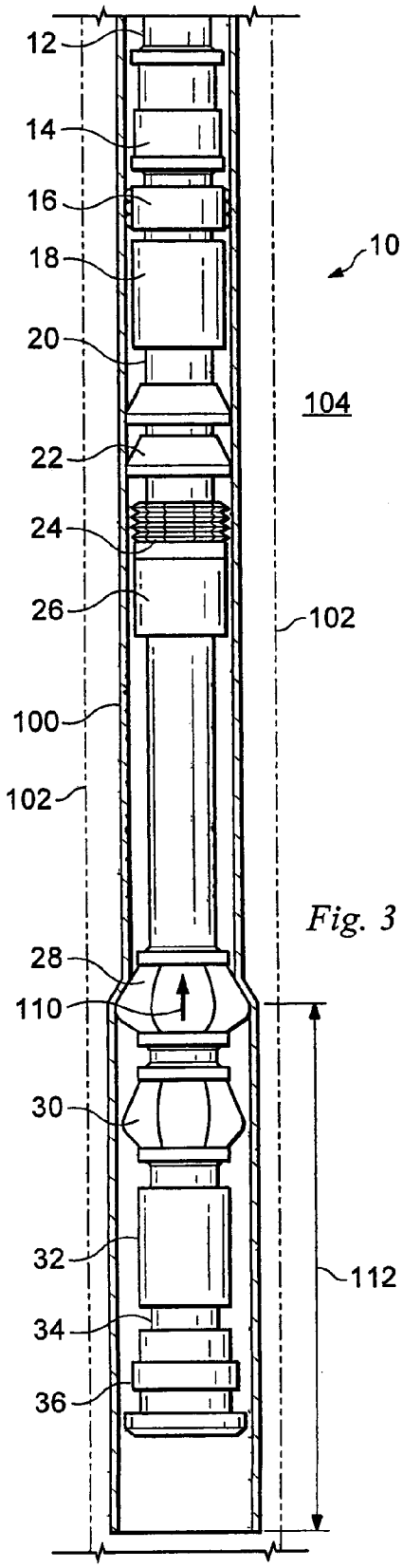
FIG. 3 is a fragmentary cross-sectional illustration of the system of FIG. 2 during the subsequent operation of the tension actuator to displace the bell section adjustable expansion cone assembly upwardly into the end of the expandable wellbore casing to form a bell section in the end of the expandable wellbore casing.

As illustrated in FIG. 3, in an exemplary embodiment, the ball gripper assembly 16 is then operated to engage and hold the position of the expandable tubular member 100 stationary relative to the tubular support member 12. The tension actuator assembly 18 is then operated to move the adjustable bell section expansion cone assembly 28, adjustable casing expansion cone assembly 30, packer setting tool assembly 32, stinger assembly 34, packer assembly 36 upwardly in a direction 110 into and through the end of the expandable wellbore casing 100. As a result, the end of the expandable wellbore casing 100 is radially expanded and plastically deformed by the adjustable bell section expansion cone assembly 28 to form a bell section 112. In an exemplary embodiment, during the operation of the system 10 described above with reference to FIG. 3, the casing lock assembly 24 may or may not be coupled to the expandable wellbore casing 100.

In an exemplary embodiment, the length of the end of the expandable wellbore casing 100 that is radially expanded and plastically deformed by the adjustable bell section expansion cone assembly 28 is limited by the stroke length of the tension actuator assembly 18. In an exemplary embodiment, once the tension actuator assembly 18 completes a stroke, the ball gripper assembly 16 is operated to release the expandable tubular member 100, and the tubular support 12 is moved upwardly to permit the tension actuator assembly to be re-set. In this manner, the length of the bell section 112 can be further extended by continuing to stroke and then re-set the position of the tension actuator assembly 18. Note, that, during the upward movement of the tubular support 12 to re-set the position of the tension actuator assembly 18, the expandable tubular wellbore casing 100 is supported by the expansion surfaces of the adjustable bell section expansion cone assembly 28.

Figure 4:
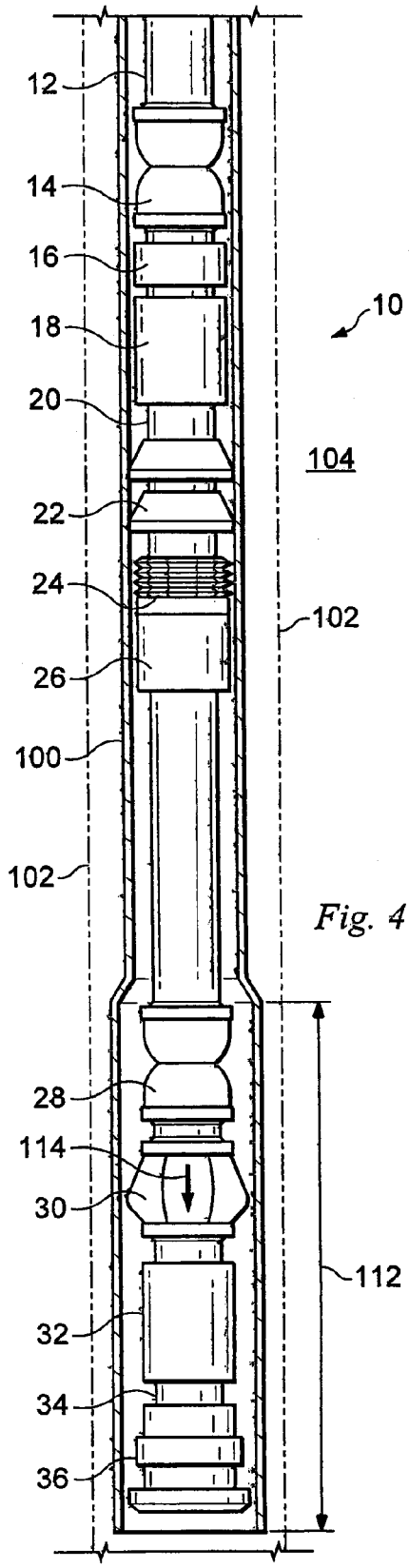
FIG. 4 is a fragmentary cross-sectional illustration of the system of FIG. 3 during the subsequent reduction of the bell section adjustable expansion cone assembly.

As illustrated in FIG. 4, in an exemplary embodiment, the casing lock assembly 24 is then operated to engage and maintain the position of the expandable wellbore casing 100 stationary relative to the tubular support 12. The adjustable bell section expansion cone assembly 28, adjustable casing expansion cone assembly 30, packer setting tool assembly 32, stinger assembly 34, and packer assembly 36 are displaced downwardly into the bell section 112 in a direction 114 relative to the expandable wellbore casing 100 by operating the extension actuator 26 and/or by displacing the system 10 downwardly in the direction 114 relative to the expandable wellbore casing. After the adjustable bell section expansion cone assembly 28 and adjustable casing expansion cone assembly 30 have been moved downwardly in the direction 114 into the bell section 112 of the expandable wellbore casing 100, the adjustable bell section expansion cone assembly is then operated to decrease the outside diameter of the adjustable bell section expansion cone assembly. In an exemplary embodiment, the decreased outside diameter of the adjustable bell section expansion cone assembly 28 is less than the increased outside diameter of the adjustable casing expansion cone assembly 30. In an exemplary embodiment, during the operation of the system illustrated and described above with reference to FIG. 4, the ball gripper 16 may or may not be operated to engage the expandable wellbore casing 100.

Figure 5:
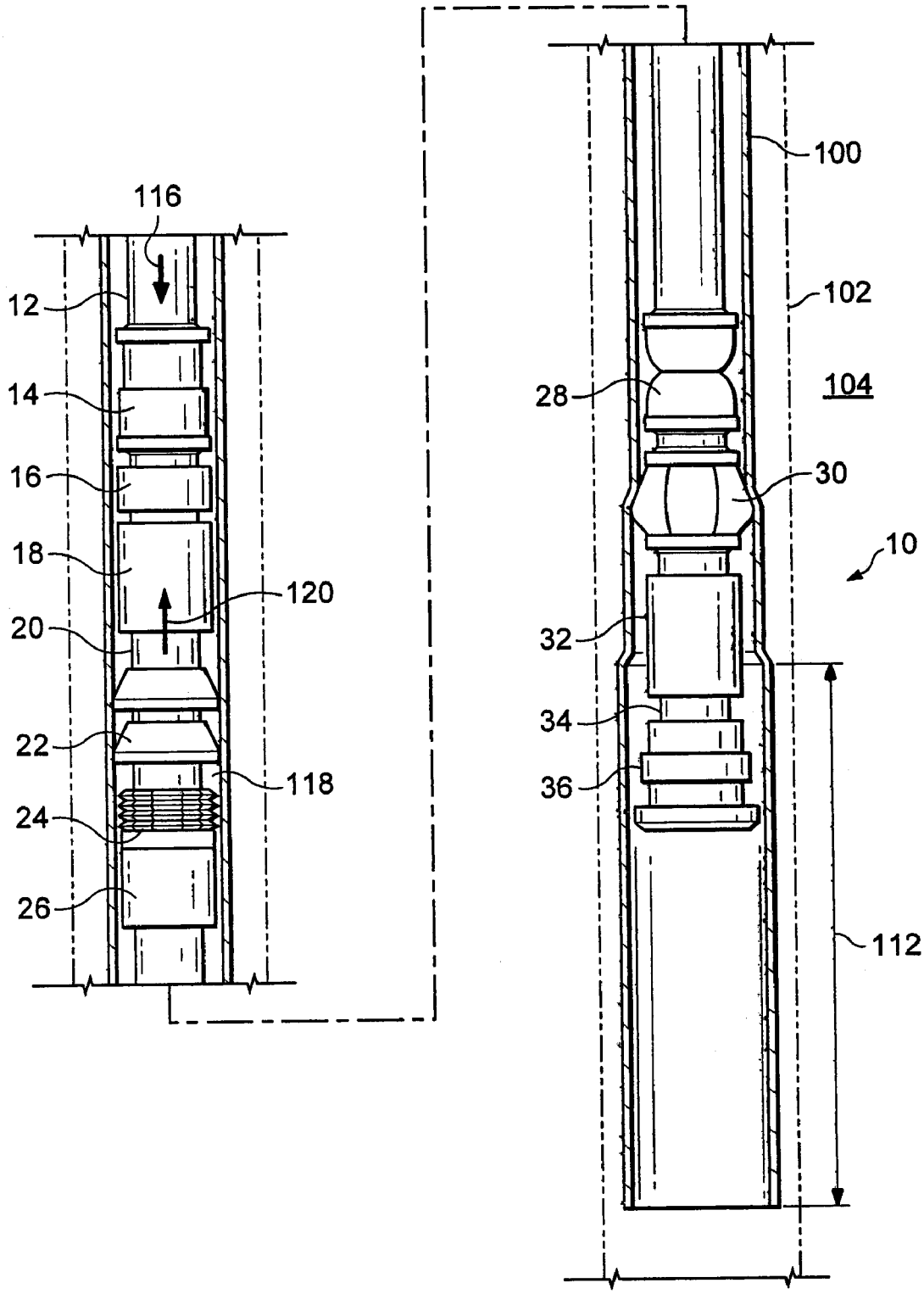
FIG. 5 is a fragmentary cross-sectional illustration of the system of FIG. 4 during the subsequent upward displacement of the expanded casing section adjustable expansion cone assembly to radially expand the expandable wellbore casing.

As illustrated in FIG. 5, in an exemplary embodiment, the casing lock assembly 24 is then disengaged from the expandable wellbore casing 100 and fluidic material 116 is then injected into the system 10 through the tubular support 12 to thereby pressurize an annulus 118 defined within the expandable wellbore casing below the cup sub assembly 22. As a result, a pressure differential is created across the cup seal assembly 22 that causes the cup seal assembly to apply a tensile force in the direction 120 to the system 10. As a result, the system 10 is displaced upwardly in the direction 120 relative to the expandable wellbore casing 100 thereby pulling the adjustable casing expansion cone assembly 30 upwardly in the direction 120 through the expandable wellbore casing thereby radially expanding and plastically deforming the expandable wellbore casing.

In an exemplary embodiment, the tension actuator assembly 16 may also be operated during the injection of the fluidic material 116 to displace the adjustable casing expansion cone assembly 30 upwardly relative to the tubular support 12. As a result, additional expansion forces may be applied to the expandable wellbore casing 100.

Figure 6:
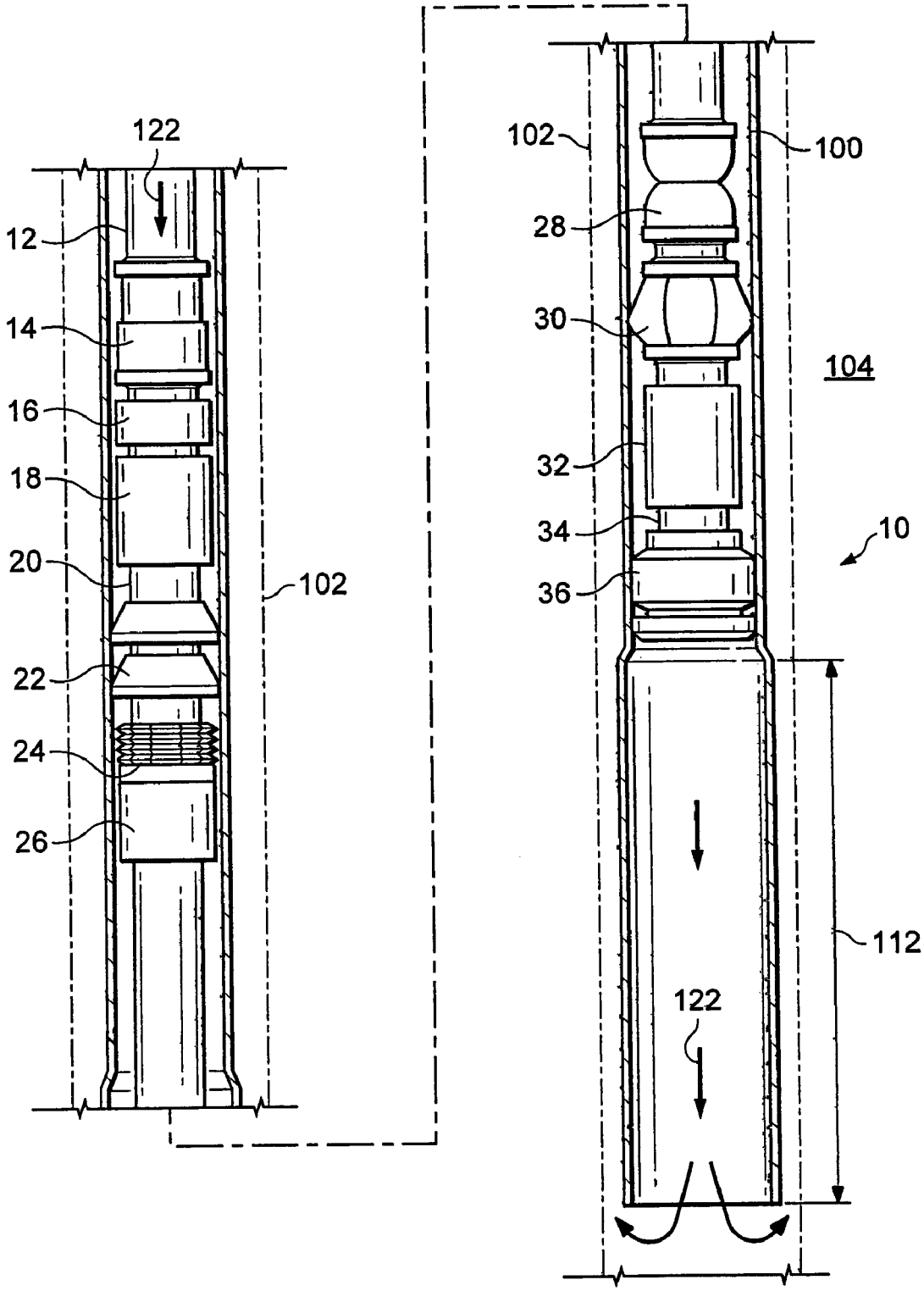
FIG. 6 is a fragmentary cross-sectional illustration of the system of FIG. 5 during the subsequent lowering of the tubular support member, casing cutter, ball gripper, a force multiplier tension actuator, safety sub, cup sub, casing lock, extension actuator, bell section adjustable expansion cone assembly, casing section adjustable expansion cone assembly, packer setting tool, packer, and stinger and subsequent setting of the packer within the expandable wellbore casing above the bell section.

As illustrated in FIG. 6, in an exemplary embodiment, the radial expansion and plastic deformation of the expandable wellbore casing using the adjustable casing expansion cone assembly 30 continues until the packer assembly 36 is positioned within a portion of the expandable tubular member above the bell section 112. The packer assembly 36 may then be operated to engage the interior surface of the expandable wellbore casing 100 above the bell section 112.

In an exemplary embodiment, after the packer assembly 36 is operated to engage the interior surface of the expandable wellbore casing 100 above the bell section 112, a hardenable fluidic sealing material 122 may then be injected into the system 10 through the tubular support 12 and then out of the system through the packer assembly to thereby permit the annulus between the expandable wellbore casing and the wellbore 102 to be filled with the hardenable fluidic sealing material. The hardenable fluidic sealing material 122 may then be allowed to cure to form a fluid tight annulus between the expandable wellbore casing 100 and the wellbore 102, before, during, or after the completion of the radial expansion and plastic deformation of the expandable wellbore casing.

Figure 7:
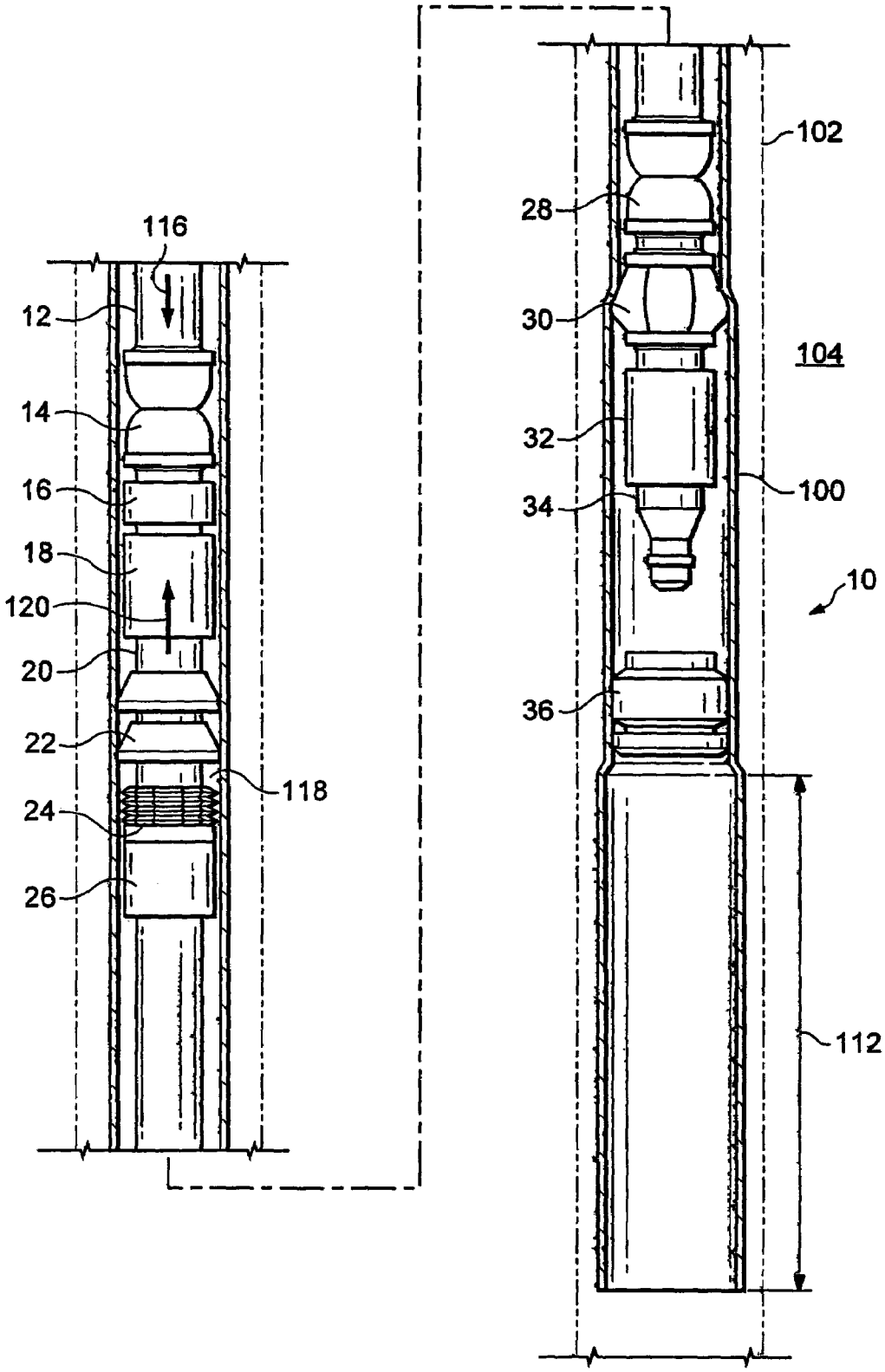
FIG. 7 is a fragmentary cross-sectional illustration of the system of FIG. 6 during the subsequent injection of fluidic materials into the system to displace the expanded casing section adjustable expansion cone assembly upwardly through the expandable wellbore casing to radially expand and plastically deform the expandable wellbore casing.

As illustrated in FIG. 7, in an exemplary embodiment, the fluidic material 116 is then re-injected into the system 10 through the tubular support 12 to thereby re-pressurize the annulus 118 defined within the expandable wellbore casing below the cup sub assembly 22. As a result, a pressure differential is once again created across the cup seal assembly 22 that causes the cup seal assembly to once again apply a tensile force in the direction 120 to the system 10. As a result, the system 10 is displaced upwardly in the direction 120 relative to the expandable wellbore casing 100 thereby pulling the adjustable casing expansion cone assembly 30 upwardly in the direction 120 through the expandable wellbore casing thereby radially expanding and plastically deforming the expandable wellbore casing and disengaging the stinger assembly 34 from the packer assembly 36. In an exemplary embodiment, during this operational mode, the packer assembly 36 prevents the flow of fluidic materials out of the expandable wellbore casing 100. As a result, the pressurization of the annulus 118 is rapid and efficient thereby enhancing the operational efficiency of the subsequent radial expansion and plastic deformation of the expandable wellbore casing 100.

In an exemplary embodiment, the tension actuator assembly 16 may also be operated during the re-injection of the fluidic material 116 to displace the adjustable casing expansion cone assembly 30 upwardly relative to the tubular support 12. As a result, additional expansion forces may be applied to the expandable wellbore casing 100.

Figure 8:
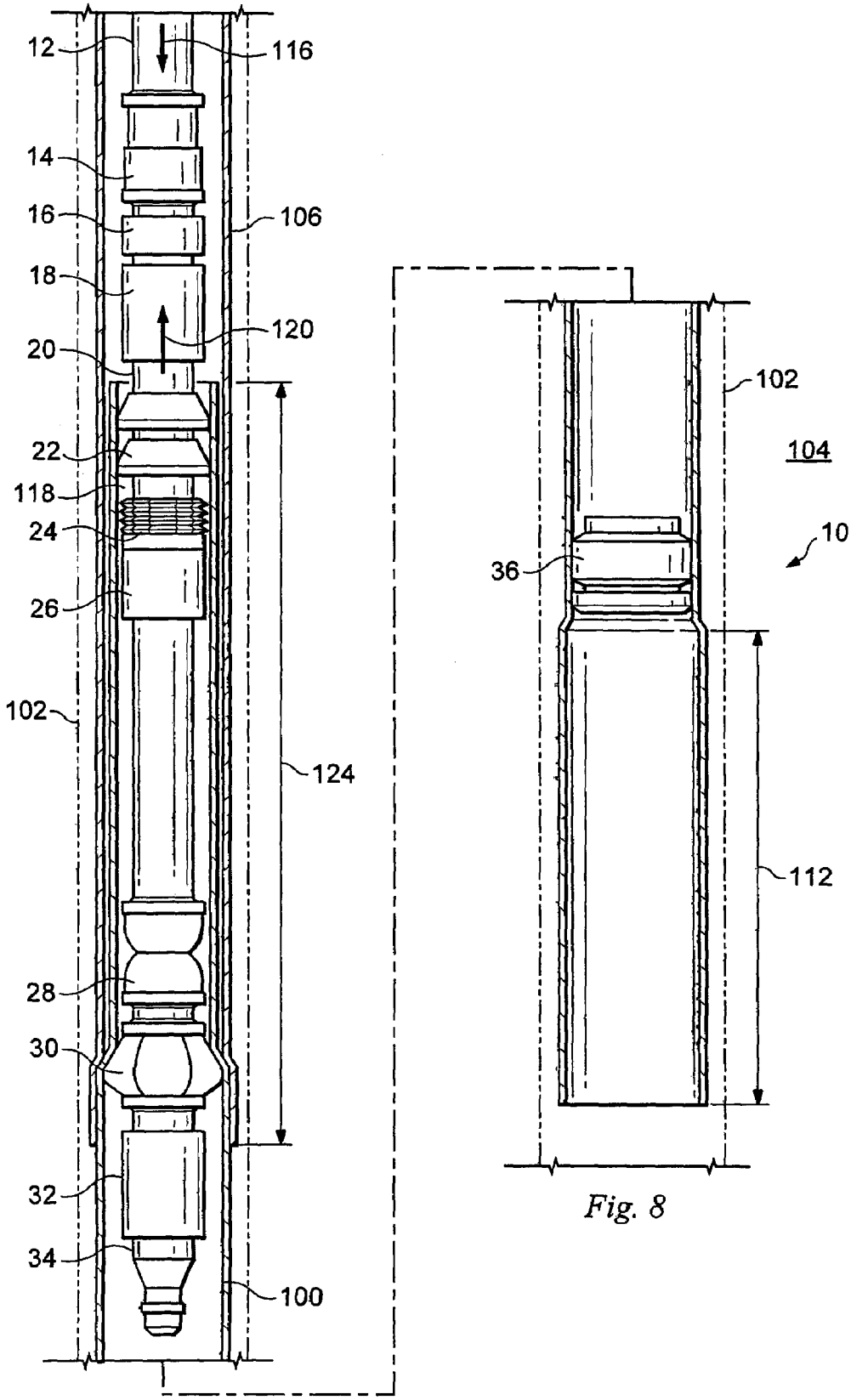
FIG. 8 is a fragmentary cross-sectional illustration of the system of FIG. 7 during the subsequent injection of fluidic materials into the system to displace the expanded casing section adjustable expansion cone assembly upwardly through the expandable wellbore casing and a surrounding preexisting wellbore casing to radially expand and plastically deform the overlapping expandable wellbore casing and the surrounding preexisting wellbore casing.

As illustrated in FIG. 8, in an exemplary embodiment, the radial expansion and plastic deformation of the expandable wellbore casing using the adjustable casing expansion cone assembly 30 continues until the adjustable casing expansion cone assembly 30 reaches the portion 124 of the expandable wellbore casing 100 that overlaps with the preexisting wellbore casing 106. At which point, the system 10 may radially expand the portion 124 of the expandable wellbore casing 100 that overlaps with the preexisting wellbore casing 106 and the surrounding portion of the preexisting wellbore casing. Consequently, in an exemplary embodiment, during the radial expansion of the portion 124 of the expandable wellbore casing 100 that overlaps with the preexisting wellbore casing 106, the tension actuator assembly 16 is also operated to displace the adjustable casing expansion cone assembly 30 upwardly relative to the tubular support 12. As a result, additional expansion forces may be applied to the expandable wellbore casing 100 and the preexisting wellbore casing 106 during the radial expansion of the portion 124 of the expandable wellbore casing that overlaps with the preexisting wellbore casing.

Figure 9:
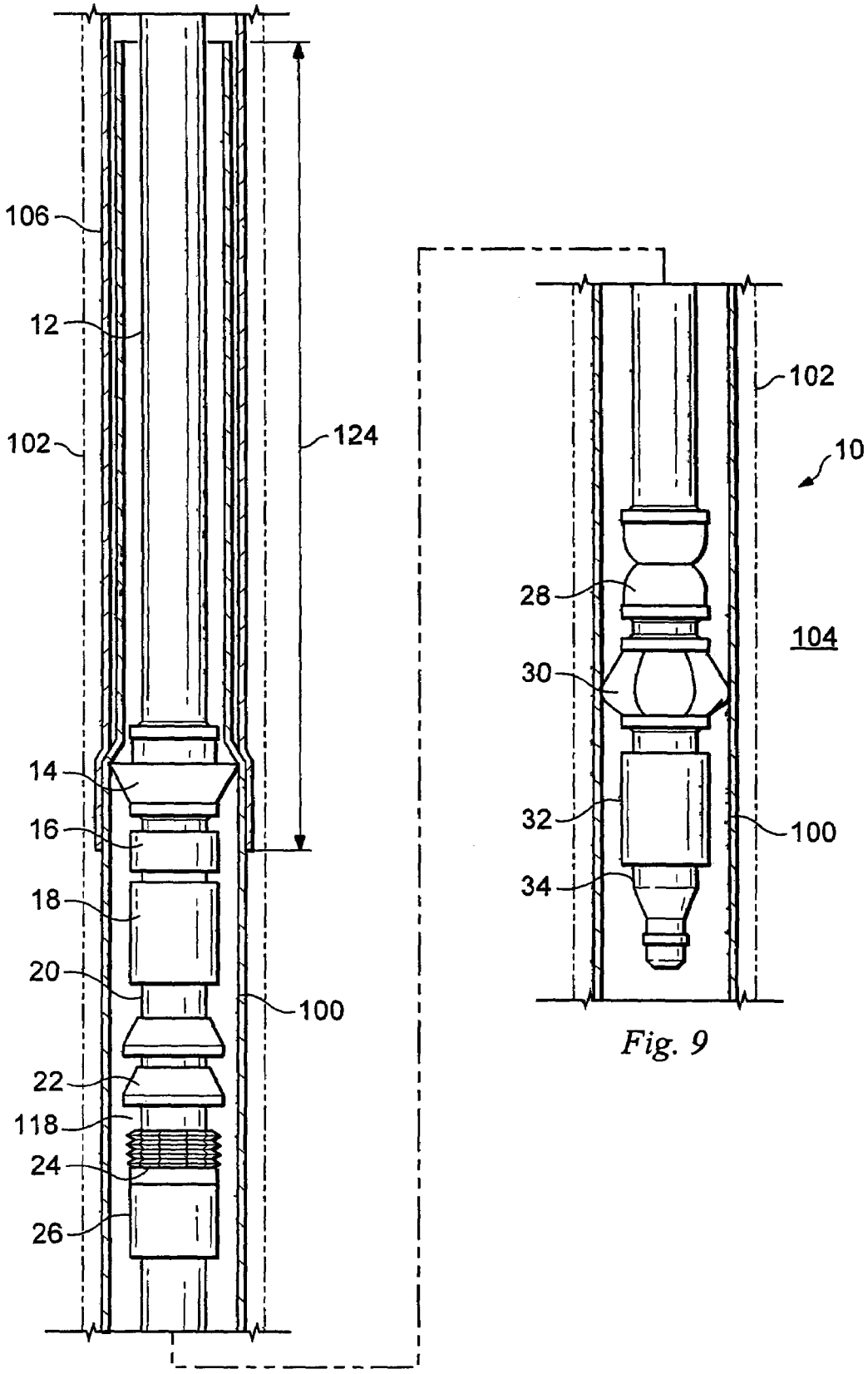
FIG. 9 is a fragmentary cross-sectional illustration of the system of FIG. 8 during the subsequent operation of the casing cutter to cut off an end of the expandable wellbore casing.

As illustrated in FIG. 9, in an exemplary embodiment, the entire length of the portion 124 of the expandable wellbore casing 100 that overlaps with the preexisting wellbore casing 106 is not radially expanded and plastically deformed.

Rather, only part of the portion 124 of the expandable wellbore casing 100 that overlaps with the preexisting wellbore casing 106 is radially expanded and plastically deformed. The remaining part of the portion 124 of the expandable wellbore casing 100 that overlaps with the preexisting wellbore casing 106 is then cut away by operating the casing cutter assembly 14.

Figure 10:
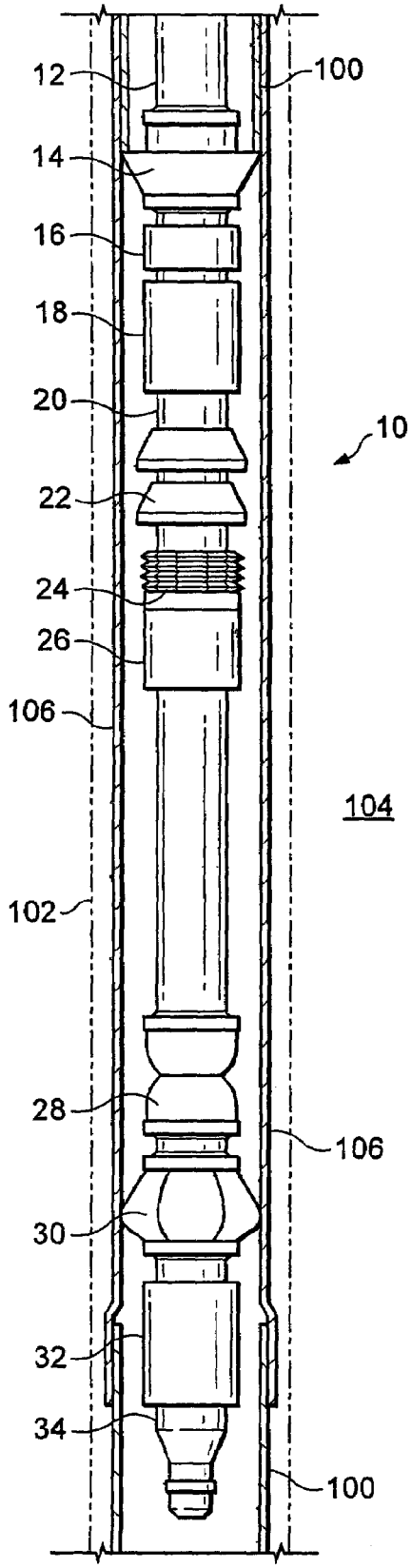
FIG. 10 is a fragmentary cross-sectional illustration of the system of FIG. 9 during the subsequent removal of the cut off end of the expandable wellbore casing.

As illustrated in FIG. 10, the remaining part of the portion 124 of the expandable wellbore casing 100 that overlaps with the preexisting wellbore casing 106 that is cut away by operating the casing cutter assembly 14 is then also carried out of the wellbore 102 using the casing cutter assembly.

Furthermore, in an exemplary embodiment, the inside diameter of the expandable wellbore casing 100 above the bell section 112 is equal to the inside diameter of the portion of the preexisting wellbore casing 106 that does not overlap with the expandable wellbore casing 100. As a result, a wellbore casing is constructed that includes overlapping wellbore casings that together define an internal passage having a constant cross-sectional area.

In an exemplary embodiment, one or more of the operational elements of the system 10 may be omitted, at least in part, and/or combined, at least in part, with one or more of the other operational elements of the system.

In several exemplary embodiments, the system 10 includes one or more of the methods and apparatus disclosed in one or more of the following: (1) U.S. Pat. No. 6,497,289, which was filed as U.S. patent application Ser. No. 09/454,139, filed on Dec. 3, 1999, which claims priority from provisional application 60/111,293, filed on Dec. 7, 1998, (2) U.S. patent application Ser. No. 09/510,913, filed on Feb. 23, 2000, which claims priority from provisional application 60/121,702, filed on Feb. 25, 1999, (3) U.S. patent application Ser. No. 09/502,350, filed on Feb. 10, 2000, which claims priority from provisional application 60/119,611, filed on Feb. 11, 1999, (4) U.S. Pat. No. 6,328,113, which was filed as U.S. patent application Ser. No. 09/440,338, filed on Nov. 15, 1999, which claims priority from provisional application 60/108,558, filed on Nov. 16, 1998, (5) U.S. patent application Ser. No. 10/169,434, filed on Jul. 1, 2002, which claims priority from provisional application 60/183,546, filed on Feb. 18, 2000, (6) U.S. patent application Ser. No. 09/523,468, filed on Mar. 10, 2000, which claims priority from provisional application 60/124,042, filed on Mar. 11, 1999, (7) U.S. Pat. No. 6,568,471, which was filed as patent application Ser. No. 09/512,895, filed on Feb. 24, 2000, which claims priority from provisional application 60/121,841, filed on Feb. 26, 1999, (8) U.S. Pat. No. 6,575,240, which was filed as patent application Ser. No. 09/511,941, filed on Feb. 24, 2000, which claims priority from provisional application 60/121,907, filed on Feb. 26, 1999, (9) U.S. Pat. No. 6,557,640, which was filed as patent application Ser. No. 09/588,946, filed on Jun. 7, 2000, which claims priority from provisional application 60/137,998, filed on Jun. 7, 1999, (10) U.S. patent application Ser. No. 09/981,916, filed on Oct. 18, 2001as a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (11) U.S. Pat. No. 6,604,763, which was filed as application Ser. No. 09/559,122, filed on Apr. 26, 2000, which claims priority from provisional application 60/131,106, filed on Apr. 26, 1999, (12) U.S. patent application Ser. No. 10/030,593, filed on Jan. 8, 2002, which claims priority from provisional application 60/146,203, filed on Jul. 29, 1999, (13) U.S. provisional patent application Ser. No. 60/143,039, filed on Jul. 9,1999, (14) U.S. patent application Ser. No. 10/111,982, filed on Apr. 30, 2002, which claims priority from provisional patent application Ser. No. 60/162,671, filed on Nov. 1, 1999, (15) U.S. provisional patent application Ser. No. 60/154,047, filed on Sep. 16, 1999, (16) U.S. provisional patent application Ser. No. 60/438,828, filed on Jan. 9, 2003, (17) U.S. Pat. No. 6,564,875, which was filed as application Ser. No. 09/679,907,on Oct. 5, 2000, which claims priority from provisional patent application Ser. No. 60/159,082, filed on Oct. 12, 1999, (18) U.S. patent application Ser. No. 10/089,419, filed on Mar. 27, 2002, which claims priority from provisional patent application Ser. No. 60/159,039, filed on Oct. 12, 1999, (19) U.S. patent application Ser. No. 09/679,906, filed on Oct. 5, 2000, which claims priority from provisional patent application Ser. No. 60/159,033, filed on Oct. 12, 1999, (20) U.S. patent application Ser. No. 10/303,992, filed on Nov. 22, 2002, which claims priority from provisional patent application Ser. No. 60/212,359, filed on Jun. 19, 2000, (21) U.S. provisional patent application Ser. No. 60/165,228, filed on Nov. 12, 1999, (22) U.S. provisional patent application Ser. No. 60/455,051, filed on Mar. 14, 2003, (23) PCT application US02/2477, filed on Jun. 26, 2002, which claims priority from U.S. provisional patent application Ser. No. 60/303,711, filed on Jul. 6, 2001, (24) U.S. patent application Ser. No. 10/311,412, filed on Dec. 12, 2002, which claims priority from provisional patent application Ser. No. 60/221,443, filed on Jul. 28, 2000, (25) U.S. patent application Ser. No. 10/, filed on Dec. 18, 2002, which claims priority from provisional patent application Ser. No. 60/221,645, filed on Jul. 28, 2000, (26) U.S. patent application Ser. No. 10/322,947, filed on Jan. 22, 2003, which claims priority from provisional patent application Ser. No. 60/233,638, filed on Sep. 18, 2000, (27) U.S. patent application Ser. No. 10/406,648, filed on Mar. 31, 2003, which claims priority from provisional patent application Ser. No. 60/237,334, filed on Oct. 2, 2000, (28) PCT application US02/04353, filed on Feb. 14, 2002, which claims priority from U.S. provisional patent application Ser. No. 60/270,007, filed on Feb. 20, 2001, (29) U.S. patent application Ser. No. 10/465,835, filed on Jun. 13, 2003, which claims priority from provisional patent application Ser. No. 60/262,434, filed on Jan. 17, 2001, (30) U.S. patent application Ser. No. 10/465,831, filed on Jun. 13, 2003, which claims priority from U.S. provisional patent application Ser. No. 60/259,486, filed on Jan. 3, 2001, (31) U.S. provisional patent application Ser. No. 60/452,303, filed on Mar. 5, 2003, (32) U.S. Pat. No. 6,470,966, which was filed as patent application Ser. No. 09/850,093, filed on May 7, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (33) U.S. Pat. No. 6,561,227, which was filed as patent application Ser. No. 09/852,026, filed on May 9, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (34) U.S. patent application Ser. No. 09/852,027, filed on May 9, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (35) PCT Application US02/25608, filed on Aug. 13, 2002, which claims priority from provisional application 60/318,021, filed on Sep. 7, 2001, (36) PCT Application US02/24399,filed on Aug. 1, 2002, which claims priority from U.S. provisional patent application Ser. No. 60/313,453, filed on Aug. 20, 2001, (37) PCT Application US02/29856, filed on Sep. 19, 2002, which claims priority from U.S. provisional patent application Ser. No. 60/326,886, filed on Oct. 3, 2001, (38) PCT Application US02/20256, filed on Jun. 26, 2002, which claims priority from U.S. provisional patent application Ser. No. 60/303,740, filed on Jul. 6, 2001, (39) U.S. patent application Ser. No. 09/962,469, filed on Sep. 25, 2001, which is a divisional of U.S. patent application Ser. No. 09/523,468, filed on Mar. 10, 2000, which claims priority from provisional application 60/124,042, filed on Mar. 11, 1999, (40) U.S. patent application Ser. No. 09/962,470, filed on Sep. 25, 2001, which is a divisional of U.S. patent application Ser. No. 09/523,468, filed on Mar. 10, 2000, which claims priority from provisional application 60/124,042, filed on Mar. 11, 1999, (41) U.S. patent application Ser. No. 09/962,471, filed on Sep. 25, 2001, which is a divisional of U.S. patent application Ser. No. 09/523,468, filed on Mar. 10, 2000, which claims priority from provisional application 60/124,042, filed on Mar. 11, 1999, (42) U.S. patent application Ser. No. 09/962,467, filed on Sep. 25, 2001, which is a divisional of U.S. patent application Ser. No. 09/523,468, filed on Mar. 10, 2000, which claims priority from provisional application 60/124,042, filed on Mar. 11, 1999, (43) U.S. patent application Ser. No. 09/962,468, filed on Sep. 25, 2001, which is a divisional of U.S. patent application Ser. No. 09/523,468, filed on Mar. 10, 2000, which claims priority from provisional application 60/124,042, filed on Mar. 11, 1999, (44) PCT application US02/25727, filed on Aug. 14, 2002, which claims priority from U.S. provisional patent application Ser. No. 60/317,985, filed on Sep. 6, 2001, and U.S. provisional patent application Ser. No. 60/318,386, filed on Sep. 10, 2001, (45) PCT application US02/39425, filed on Dec. 10, 2002, which claims priority from U.S. provisional patent application Ser. No. 60/343,674, filed on Dec. 27, 2001, (46) U.S. utility patent application Ser. No. 09/969,922, filed on Oct. 3, 2001, which is a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (47) U.S. utility patent application Ser. No. 10/516,467, filed on Dec. 10, 2001, which is a continuation application of U.S. utility patent application Ser. No. 09/969,922, filed on Oct. 3, 2001, which is a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (48) PCT application US03/00609, filed on Jan. 9, 2003, which claims priority from U.S. provisional patent application Ser. No. 60/357,372, filed on Feb. 15, 2002, (49) U.S. patent application Ser. No. 10/074,703, filed on Feb. 12, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (50) U.S. patent application Ser. No. 10/074,244, filed on Feb. 12, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (51) U.S. patent application Ser. No. 10/076,660, filed on Feb. 15, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (52) U.S. patent application Ser. No. 10/076,661, filed on Feb. 15, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (53) U.S. patent application Ser. No. 10/076,659, filed on Feb. 15, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (54) U.S. patent application Ser. No. 10/078,928, filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (55) U.S. patent application Ser. No. 10/078,922, filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (56) U.S. patent application Ser. No. 10/078,921, filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (57) U.S. patent application Ser. No. 10/261,928, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (58) U.S. patent application Ser. No. 10/079,276, filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (59) U.S. patent application Ser. No. 10/262,009, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (60) U.S. patent application Ser. No. 10/092,481, filed on Mar. 7, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (61) U.S. patent application Ser. No. 10/261,926, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (62) PCT application US 02/36157, filed on Nov. 12, 2002, which claims priority from U.S. provisional patent application Ser. No. 60/338,996, filed on Nov. 12, 2001, (63) PCT application US 02/36267, filed on Nov. 12, 2002, which claims priority from U.S. provisional patent application Ser. No. 60/339,013, filed on Nov. 12, 2001, (64) PCT application US 03/11765, filed on Apr. 16, 2003, which claims priority from U.S. provisional patent application Ser. No. 60/383,917, filed on May 29, 2002, (65) PCT application US 03/15020, filed on May 12, 2003, which claims priority from U.S. provisional patent application Ser. No. 60/391,703, filed on Jun. 26, 2002, (66) PCT application US 02/39418, filed on Dec. 10, 2002, which claims priority from U.S. provisional patent application Ser. No. 60/346,309, filed on Jan. 7, 2002, (67) PCT application US 03/06544, filed on Mar. 4, 2003, which claims priority from U.S. provisional patent application Ser. No. 60/372,048, filed on Apr. 12, 2002, (68) U.S. patent application Ser. No. 10/331,718, filed on Dec. 30, 2002, which is a divisional U.S. patent application Ser. No. 09/679,906, filed on Oct. 5, 2000, which claims priority from provisional patent application Ser. No. 60/159,033, filed on Oct. 12, 1999, (69) PCT application US 03/04837, filed on Feb. 29, 2003, which claims priority from U.S. provisional patent application Ser. No. 60/363,829, filed on Mar. 13, 2002, (70) U.S. patent application Ser. No. 10/261,927, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (71) U.S. patent application Ser. No. 10/262,008, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (72) U.S. patent application Ser. No. 10/261,925, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (73) U.S. patent application Ser. No. 10/199,524, filed on Jul. 19, 2002, which is a continuation of U.S. Pat. No. 6,497,289, which was filed as U.S. patent application Ser. No. 09/454,139, filed on Dec. 3, 1999, which claims priority from provisional application 60/111,293, filed on Dec. 7, 1998, (74) PCT application US 03/10144, filed on Mar. 28, 2003, which claims priority from U.S. provisional patent application Ser. No. 60/372,632, filed on Apr. 15, 2002, (75) U.S. provisional patent application Ser. No. 60/412,542, filed on Sep. 20, 2002, (76) PCT application US 03/14153, filed on May 6, 2003, which claims priority from U.S. provisional patent application Ser. No. 60/380,147, filed on May 6, 2002, (77) PCT application US 03/19993, filed on Jun. 24, 2003, which claims priority from U.S. provisional patent application Ser. No. 60/397,284, filed on Jul. 19, 2002, (78) PCT application US 03/13787, filed on May 5, 2003, which claims priority from U.S. provisional patent application Ser. No. 60/387,486, filed on Jun. 10, 2002, (79) PCT application US 03/18530, filed on Jun. 11, 2003, which claims priority from U.S. provisional patent application Ser. No. 60/387,961, filed on Jun. 12, 2002, (80) PCT application US 03/20694, filed on Jul. 1, 2003, which claims priority from U.S. provisional patent application Ser. No. 60/398,061, filed on Jul. 24, 2002, (81) PCT application US 03/20870, filed on Jul. 2, 2003, which claims priority from U.S. provisional patent application Ser. No. 60/399,240, filed on Jul. 29, 2002, (82) U.S. provisional patent application Ser. No. 60/412,487, filed on Sep. 20, 2002, (83) U.S. provisional patent application Ser. No. 60/412,488, filed on Sep. 20, 2002, (84) U.S. patent application Ser. No. 10/280,356, filed on Oct. 25, 2002, which is a continuation of U.S. Pat. No. 6,470,966, which was filed as patent application Ser. No. 09/850,093, filed on May 7, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (85) U.S. provisional patent application Ser. No. 60/412,177, filed on Sep. 20, 2002, (86) U.S. provisional patent application Ser. No. 60/412,653, filed on Sep. 20, 2002, (87) U.S. provisional patent application Ser. No. 60/405,610, filed on Aug. 23, 2002, (88) U.S. provisional patent application Ser. No. 60/405,394, filed on Aug. 23, 2002, (89) U.S. provisional patent application Ser. No. 60/412,544, filed on Sep. 20, 2002, (90) PCT application US 03/24779, filed on Aug. 8, 2003, which claims priority from U.S. provisional patent application Ser. No. 60/407,442, filed on Aug. 30, 2002, (91) U.S. provisional patent application Ser. No. 60/423,363, filed on Dec. 10, 2002, (92) U.S. provisional patent application Ser. No. 60/412,196, filed on Sep. 20, 2002, (93) U.S. provisional patent application Ser. No. 60/412,187, filed on Sep. 20, 2002, (94) U.S. provisional patent application Ser. No. 60/412,371, filed on Sep. 20, 2002, (95) U.S. patent application Ser. No. 10/382,325, filed on Mar. 5, 2003, which is a continuation of U.S. Pat. No. 6,557,640, which was filed as patent application Ser. No. 09/588,946, filed on Jun. 7, 2000, which claims priority from provisional application 60/137,998, filed on Jun. 7, 1999, (96) U.S. patent application Ser. No. 10/624,842, filed on Jul. 22, 2003, which is a divisional of U.S. patent application Ser. No. 09/502,350, filed on Feb. 10, 2000, which claims priority from provisional application 60/119,611, filed on Feb. 11, 1999, (97) U.S. provisional patent application Ser. No. 60/431,184, filed on Dec. 5, 2002, (98) U.S. provisional patent application Ser. No. 60/448,526, filed on Feb. 18, 2003, (99) U.S. provisional patent application Ser. No. 60/461,539, filed on Apr. 9, 2003, (100) U.S. provisional patent application Ser. No. 60/462,750, filed on Apr. 14, 2003, (101) U.S. provisional patent application Ser. No. 60/436,106, filed on Dec. 23, 2002, (102) U.S. provisional patent application Ser. No. 60/442,942, filed on Jan. 27, 2003, (103) U.S. provisional patent application Ser. No. 60/442,938, filed on Jan. 27, 2003, (104) U.S. provisional patent application Ser. No. 60/418,687, filed on Apr. 18, 2003, (105) U.S. provisional patent application Ser. No. 60/454,896, filed on Mar. 14, 2003, (106) U.S. provisional patent application Ser. No. 60/450,504, filed on Feb. 26, 2003, (107) U.S. provisional patent application Ser. No. 60/451,152, filed on Mar. 9, 2003, (108) U.S. provisional patent application Ser. No. 60/455,124, filed on Mar. 17, 2003, (109) U.S. provisional patent application Ser. No. 60/453,678, filed on Mar. 11, 2003, (110) U.S. patent application Ser. No. 10/421,682, filed on Apr. 23, 2003, which is a continuation of U.S. patent application Ser. No. 09/523,468, filed on Mar. 10, 2000, which claims priority from provisional application 60/124,042, filed on Mar. 11, 1999, (111) U.S. provisional patent application Ser. No. 60/457,965, filed on Mar. 27, 2003, (112) U.S. provisional patent application Ser. No. 60/455,718, filed on Mar. 18, 2003, (113) U.S. Pat. No. 6,550,821, which was filed as patent application Ser. No. 09/811,734, filed on Mar. 19, 2001, (114) U.S. patent application Ser. No. 10/436,467, filed on May 12, 2003, which is a continuation of U.S. Pat. No. 6,604,763, which was filed as application Ser. No. 09/559,122, filed on Apr. 26, 2000, which claims priority from provisional application 60/131,106, filed on Apr. 26, 1999, (115) U.S. provisional patent application Ser. No. 60/459,776, filed on Apr. 2, 2003, (116) U.S. provisional patent application Ser. No. 60/461,094, filed on Apr. 8, 2003, (117) U.S. provisional patent application Ser. No. 60/461,038, filed on Apr. 7, 2003, (118) U.S. provisional patent application Ser. No. 60/463,586, filed on Apr. 17, 2003, (119) U.S. provisional patent application Ser. No. 60/472,240, filed on May 20, 2003, (120) U.S. patent application Ser. No. 10/619,285, filed on Jul. 14, 2003, which is a continuation-in-part of U.S. utility patent application Ser. No. 09/969,922, filed on Oct. 3, 2001, which is a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (121) U.S. utility patent application Ser. No. 10/418,688, which was filed on Apr. 18, 2003, as a division of U.S. utility patent application Ser. No. 09/523,468, filed on Mar. 10, 2000, which claims priority from provisional application 60/124,042, filed on Mar. 11, 1999, (122) PCT patent application Ser. no. PCT/US04/06246, filed on Feb. 26, 2004, (123) PCT patent application Ser. No. PCT/US04/08170, filed on Mar. 15, 2004, (124) PCT patent application Ser. No. PCT/US04/08171, filed on Mar. 15, 2004, (125) PCT patent application Ser. No. PCT/US04/08073, filed on Mar. 18, 2004, (126) PCT patent application Ser. No. PCT/US04/07711, filed on Mar. 11, 2004, (127) PCT patent application Ser. No. PCT/US04/009434, filed on Mar. 26, 2004, (128) PCT patent application Ser. No. PCT/US04/010317, filed on Apr. 2, 2004, (129) PCT patent application Ser. No. PCT/US04/010712, filed on Apr. 7, 2004, and (130) PCT patent application Ser. No. PCT/US04/010762, filed on Apr. 6, 2004, and/or PCT application Ser. No. PCT/US04/011973, filed on Apr. 15, 2004, the disclosures of which are incorporated herein by reference.

In an exemplary embodiment, the casing cutter assembly 14 is provided and operates substantially, at least in part, as disclosed in one or more of the following: (1) PCT patent application Ser. No. PCT/US03/29858, filed on Sep. 22, 2003, and/or (2) PCT patent application Ser. No. PCT/US04/07711, filed on Mar. 11, 2004, and/or (3) PCT patent application Ser. No. PCT/US04/009434, filed on Mar. 26, 2004, and/or (4) PCT patent application Ser. No. PCT/US04/10317, filed on Apr. 2, 2004, (5) PCT patent application Ser. No. PCT/US04/010712, filed on Apr. 7, 2004, and/or (6) PCT patent application Ser. No. PCT/US04/010762, filed on Apr. 6, 2004, and/or PCT application Ser. No. PCT/US04/011973, filed on Apr. 15, 2004, the disclosures of which are incorporated herein by reference.

In an exemplary embodiment, as illustrated in FIGS. 11-1 and 11-2, 11A1 to 11A2, 11B1 to 11B2, 11C, 11D, 11E, 11F, 11G, 11H, 11I, 11j, 11K, 11L, 11M, 11N, 11O, 11P, 11Q, 11R, 11S, 11T, 11U, 11V, 11W, 11X, 11Y, 11Z1 to 11Z4, 11AA1 to 11AA4, 11AB1 to 11AB4, 11AC1 to 11AC4, 11AD, and 11AE, the casing cutter assembly 14 includes an upper tubular tool joint 14002 that defines a longitudinal passage 14002*a* and mounting holes, 14002*b* and 14002*c*, and includes an internal threaded connection 14002*d*, an inner annular recess 14002*e*, an inner annular recess 14002*f*, and an internal threaded connection 14002*g*. A tubular torque plate 14004 that defines a longitudinal passage 14004*a* and includes circumferentially spaced apart teeth 14004*b* is received within, mates with, and is coupled to the internal annular recess 14002*e* of the upper tubular tool joint 14002.

Circumferentially spaced apart teeth 14006*a* of an end of a tubular lower mandrel 14006 that defines a longitudinal passage 14006*b*, a radial passage 14006*ba*, and a radial passage 14006*bb* and includes an external threaded connection 14006*c*, an external flange 14006*d*, an external annular recess 14006*e* having a step 14006*f* at one end, an external annular recess 14006*g*, external teeth 14006*h*, an external threaded connection 14006*i*, and an external annular recess 14006*j* engage the circumferentially spaced apart teeth 14004*b* of the tubular torque plate 14004. An internal threaded connection 14008*a* of an end of a tubular toggle bushing 14008 that defines a longitudinal passage 14008*b*, an upper longitudinal slot 14008*c*, a lower longitudinal slot 14008*d*, mounting holes, 14008*e*, 14008*f*, 14008*g*, 14008*h*, 14008*i*, 14008*j*, 14008*k*, 14008*l*, 14008*m*, 14008*n*, 14008*o*, 14008*p*, 14008*q*, 14008*r*, 14008*s*, 14008*t*, 14008*u*, 14008*v*, 14008*w*, 14008*x*, 14008*xa*, and 14008*xb*, and includes an external annular recess 14008*y*, internal annular recess 14008*z*, external annular recess 14008*aa*, and an external annular recess 14008*ab* receives and is coupled to the external threaded connection 14006*c* of the tubular lower mandrel 14006.

A sealing element 14010 is received within the external annular recess 14008*y* of the tubular toggle bushing 14008 for sealing the interface between the tubular toggle bushing and the upper tubular tool joint 14002. A sealing element 14012 is received within the internal annular recess 14008*z* of the tubular toggle bushing 14008 for sealing the interface between the tubular toggle bushing and the tubular lower mandrel 14006.

Mounting screws, 14014*a* and 14014*b*, mounted within and coupled to the mounting holes, 14008*w* and 14008*x*, respectively, of the tubular toggle bushing 14008 are also received within the mounting holes, 14002*b* and 14002*c*, of the upper tubular tool joint 14002. Mounting pins, 14016*a*, 14016*b*, 14016*c*, 14016*d*, and 14016*e*, are mounted within the mounting holes, 14008*e*, 14008*f*, 14008*g*, 14008*h*, and 14008*i*, respectively. Mounting pins, 14018*a*, 14018*b*, 14018*c*, 14018*d*, and 14018*e*, are mounted within the mounting holes, 14008*t*, 14008*s*, 14008*r*, 14008*q*, and 14008*p*, respectively. Mounting screws, 14020*a* and 14020*b*, are mounted within the mounting holes, 14008*u* and 14008*v*, respectively.

A first upper toggle link 14022 defines mounting holes, 14022*a* and 14022*b*, for receiving the mounting pins, 14016*a* and 14016*b*, and includes a mounting pin 14022*c* at one end. A first lower toggle link 14024 defines mounting holes, 14024*a*, 14024*b*, and 14024*c*, for receiving the mounting pins, 14022*c*, 14016*c*, and 14016*d*, respectively and includes an engagement arm 14024*d*. A first trigger 14026 defines a mounting hole 14026*a* for receiving the mounting pin 14016*e* and includes an engagement arm 14026*b* at one end, an engagement member 14026*c*, and an engagement arm 14026*d* at another end.

A second upper toggle link 14028 defines mounting holes, 14028*a* and 14028*b*, for receiving the mounting pins, 14018*a* and 14018*b*, and includes a mounting pin 14028*c* at one end. A second lower toggle link 14030 defines mounting holes, 14030*a*, 14030*b*, and 14030*c*, for receiving the mounting pins, 14028*c*, 14018*c*, and 14018*d*, respectively and includes an engagement arm 14030*d*. A second trigger 14032 defines a mounting hole 14032*a* for receiving the mounting pin 14018*e* and includes an engagement arm 14032*b* at one end, an engagement member 14032*c*, and an engagement arm 14032*d* at another end.

An end of a tubular spring housing 14034 that defines a longitudinal passage 14034*a*, mounting holes, 14034*b* and 14034*c*, and mounting holes, 14034*ba* and 14034*ca*, and includes an internal flange 14034*d* and an internal annular recess 14034*e* at one end, and an internal flange 14034*f*, an internal annular recess 14034*g*, an internal annular recess 14034*h*, and an external threaded connection 14034*i* at another end receives and mates with the end of the tubular toggle bushing 14008. Mounting screws, 14035*a* and 14035*b*, are mounted within and coupled to the mounting holes, 14008*xb* and 14008*xa*, respectively, of the tubular toggle bushing 14008 and are received within the mounting holes, 14034*ba* and 14034*ca*, respectively, of the tubular spring housing 14034.

A tubular retracting spring ring 14036 that defines mounting holes, 14036*a* and 14036*b*, receives and mates with a portion of the tubular lower mandrel 14006 and is received within and mates with a portion of the tubular spring housing 14034. Mounting screws, 14038*a* and 14038*b*, are mounted within and coupled to the mounting holes, 14036*a* and 14036*b*, respectively, of the tubular retracting spring ring 14036 and extend into the mounting holes, 14034*b* and 14034*c*, respectively, of the tubular spring housing 14034.

Casing diameter sensor springs, 14040*a* and 14040*b*, are positioned within the longitudinal slots, 14008*c* and 1408*d*, respectively, of the tubular toggle bushing 14008 that engage the engagement members, 14026*c* and 14032*c*, and engagement arms, 14026*d* and 14032*d*, of the first and second triggers, 14026 and 14032, respectively. An inner flange 14042*a* of an end of a tubular spring washer 14042 mates with and receives a portion of the tubular lower mandrel 14006 and an end face of the inner flange of the tubular spring washer is positioned proximate and end face of the external flange 14006*d* of the tubular lower mandrel. The tubular spring washer 14042 is further received within the longitudinal passage 14034*a* of the tubular spring housing 14034.

An end of a retracting spring 14044 that receives the tubular lower mandrel 14006 is positioned within the tubular spring washer 14042 in contact with the internal flange 14042*a* of the tubular spring washer and the other end of the retracting spring is positioned in contact with an end face of the tubular retracting spring ring 14036.

A sealing element 14046 is received within the external annular recess 14006*j* of the tubular lower mandrel 14006 for sealing the interface between the tubular lower mandrel and the tubular spring housing 14034. A sealing element 14048 is received within the internal annular recess 14034*h* of the tubular spring housing 14034 for sealing the interface between the tubular spring housing and the tubular lower mandrel 14006.

An internal threaded connection 14050*a* of an end of a tubular upper hinge sleeve 14050 that includes an internal flange 14050*b* and an internal pivot 14050*c* receives and is coupled to the external threaded connection 14034*i* of the end of the tubular spring housing 14034.

An external flange 14052*a* of a base member 14052*b* of an upper cam assembly 14052, that is mounted upon and receives the lower tubular mandrel 14006, that includes an internal flange 14052*c* that is received within the external annular recess 14006*e* of the lower tubular mandrel 14006 and a plurality of circumferentially spaced apart cam arms 14052*d* extending from the base member mates with and is received within the tubular upper hinge sleeve 14050. The base member 14052*b* of the upper cam assembly 14052 further includes a plurality of circumferentially spaced apart teeth 14052*f* that mate with and are received within a plurality of circumferentially spaced apart teeth 14034*j* provided on the end face of the tubular spring housing 14034 and an end face of the external flange 14052*a* of the base member of the upper cam assembly is positioned in opposing relation to an end face of the internal flange 14050*b* of the tubular upper hinge sleeve 14050. Each of the cam arms 14052*d* of the upper cam assembly 14052 include external cam surfaces 14052*e*. In an exemplary embodiment, the teeth 14052*f* of the base member 14052*b* of the upper cam assembly 14052 and the teeth 14034*j* provided on the end face of the tubular spring housing 14034 permit torsional loads to be transmitted between the tubular spring housing and the upper cam assembly.

A plurality of circumferentially spaced apart upper casing cutter segments 14054 are mounted upon and receive the lower tubular mandrel 14006 and each include an external pivot recess 14054*a* for mating with and receiving the internal pivot 14050*c* of the tubular upper hinge sleeve 14050 and an external flange 14054*b* and are pivotally mounted within the tubular upper hinge sleeve and are interleaved with the circumferentially spaced apart cam arms 14052*d* of the upper cam assembly 14052. A casing cutter element 14056 is coupled to and supported by the upper surface of each upper casing cutter segments 14054 proximate the external flange 14054*b*.

A plurality of circumferentially spaced apart lower casing cutter segments 14058 are mounted upon and receive the lower tubular mandrel 14006, are interleaved among the upper casing cutter segments 14054, are oriented in the opposite direction to the upper casing cutter segments 14054, each include an external pivot recess 14058*a*, and are positioned in opposing relation to corresponding circumferentially spaced apart cam arms 14052*d* of the upper cam assembly 14052.

A lower cam assembly 14060 is mounted upon and receives the lower tubular mandrel 14006 that includes a base member 14060*a* having an external flange 14060*b*, a plurality of circumferentially spaced apart cam arms 14060*d* that extend from the base member that each include external cam surfaces 14060*e* and define mounting holes 14060*f* and 14060*g*. The base member 14060*a* of the lower cam assembly 14060 further includes a plurality of circumferentially spaced apart teeth 14060*h*. The circumferentially spaced apart cam arms 14060*d* of the lower cam assembly 14060 are interleaved among the lower casing cutter segments 14058 and the circumferentially spaced apart cam arms 14052*d* of the upper cam assembly 14052 and positioned in opposing relation to corresponding upper casing cutter segments 14054.

Mounting screws, 14062*a*, 14062*b*, 14062*c*, and 14062*e*, are mounted within the corresponding mounting holes, 14060*f* and 14060*g*, of the lower cam assembly 14060 and are received within the external annular recess 14006*g* of the lower cam assembly 14060.

A tubular lower hinge sleeve 14064 that receives the lower casing cutter segments 14058 and the lower cam assembly 14060 includes an internal flange 14064*a* for engaging the external flange 14060*b* of the base member of the lower cam assembly 14060, an internal pivot 14064*b* for engaging and receiving the external pivot recess 14058*a* of the lower casing cutter segments 14058 thereby pivotally mounting the lower casing cutter segments within the tubular lower hinge sleeve, and an internal threaded connection 14064*c*.

An external threaded connection 14066*a* of an end of a tubular sleeve 14066 that defines mounting holes, 14066*b* and 14066*c*, and includes an internal annular recess 14066*d* having a shoulder 14066*e*, an internal flange 14066*f*, and an internal threaded connection 14066*g* at another end is received within and coupled to the internal threaded connection 14064*c* of the tubular lower hinge sleeve 14064. An external threaded connection 14068*a* of an end of a tubular member 14068 that defines a longitudinal passage 14068*b* and mounting holes, 14068*c* and 14068*d*, and includes an external annular recess 14068*e*, and an external threaded connection 14068*f* at another end is received within and is coupled to the internal threaded connection 14066*g* of the tubular sleeve 14066.

Mounting screws, 14070*a* and 14070*b*, are mounted in and coupled to the mounting holes, 14068*c* and 14068*d*, respectively, of the tubular member 14068 that also extend into the mounting holes, 14066*b* and 14066*c*, respectively, of the tubular sleeve 14066. A sealing element 14072 is received within the external annular recess 14068*e* of the tubular member 14068 for sealing the interface between the tubular member and the tubular sleeve 14066.

An internal threaded connection 14074*a* of a tubular retracting piston 14074 that defines a longitudinal passage 14074*b* and includes an internal annular recess 14074*c* and an external annular recess 14074*d* receives and is coupled to the external threaded connection 14006*i* of the tubular lower mandrel 14006. A sealing element 14076 is received within the external annular recess 14074*d* of the tubular retracting piston 14074 for sealing the interface between the tubular retracting piston and the tubular sleeve 14066. A sealing element 14078 is received within the internal annular recess 14074*c* of the tubular retracting piston 14074 for sealing the interface between the tubular retracting piston and the tubular lower mandrel 14006.

Locking dogs 14080 mate with and receive the external teeth 14006*h* of the tubular lower mandrel 14006. A spacer ring 14082 is positioned between an end face of the locking dogs 14080 and an end face of the lower cam assembly 14060.

A release piston 14084 mounted upon the tubular lower mandrel 14006 defines a radial passage 14084*a* for mounting a burst disk 14086 includes sealing elements, 14084*b*, 14084*c*, and 14084*d*. The sealing elements, 14084*b* and 14084*d*, sealing the interface between the release piston 14084 and the tubular lower mandrel 14006. An end face of the release piston 14084 is positioned in opposing relation to an end face of the locking dogs 14080.

A release sleeve 14088 that receives and is mounted upon the locking dogs 14080 and the release piston 14084 includes an internal flange 14088*a* at one end that sealingly engages the tubular lower mandrel 14006. A bypass sleeve 14090 that receives and is mounted upon the release sleeve 14088 includes an internal flange 14090*a* at one end.

In an exemplary embodiment, during operation of the casing cutter assembly 14, the retracting spring 14044 is compressed and thereby applies a biasing spring force in a direction 14092 from the lower tubular mandrel 14006 to the tubular spring housing 14034 that, in the absence of other forces, moves and/or maintains the upper cam assembly 14052 and the upper casing cutter segments 14054 out of engagement with the lower casing cutter segments 14058 and the lower cam assembly 14060. In an exemplary embodiment, during operation of the casing cutter assembly 14, an external threaded connection 12*a* of an end of the tubular support member 12 is coupled to the internal threaded connection 14002*d* of the upper tubular tool joint 14002 and an internal threaded connection 16*a* of an end of the ball gripper assembly 16 is coupled to the external threaded connection 14068*f* of the tubular member 14068.

The upper cam assembly 14052 and the upper casing cutter segments 14054 may be brought into engagement with the lower casing cutter segments 14058 and the lower cam assembly 14060 by pressurizing an annulus 14094 defined between the lower tubular mandrel 14006 and the tubular spring housing 14034. In particular, injection of fluidic materials into the cam cutter assembly 14 through the longitudinal passage 14006*b* of the lower tubular mandrel 14006 and into the radial passage 14006*ba* may pressurize the annulus 14094 thereby creating sufficient operating pressure to generate a force in a direction 14096 sufficient to overcome the biasing force of the retracting spring 14044. As a result, the spring housing 14034 may be displaced in the direction 14096 relative to the lower tubular mandrel 14006 thereby displacing the tubular upper hinge sleeve 14050, upper cam assembly 14052 , and upper casing cutter segments 14054 in the direction 14096.

Figures 1, 11:
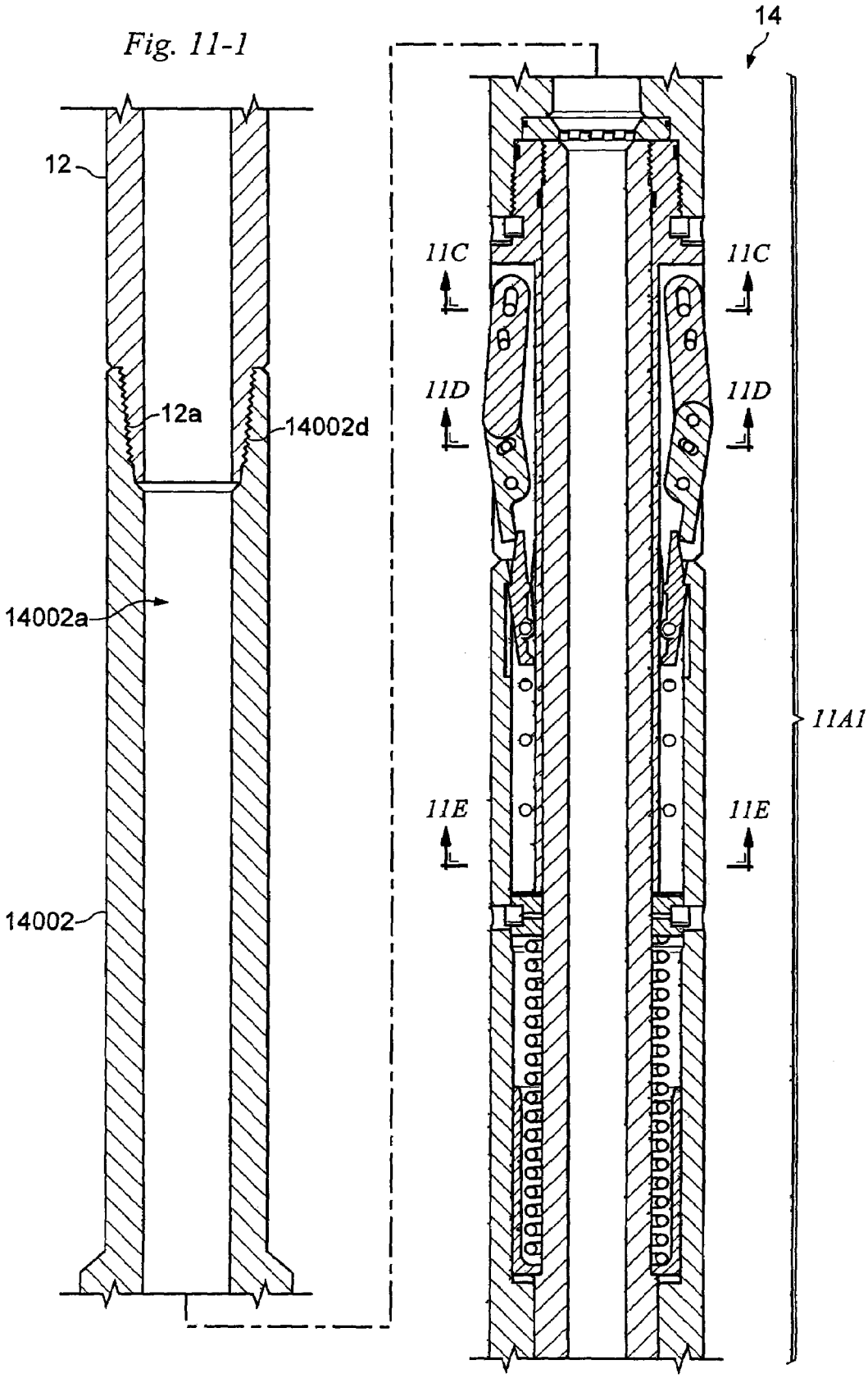
Figures 2, 11:
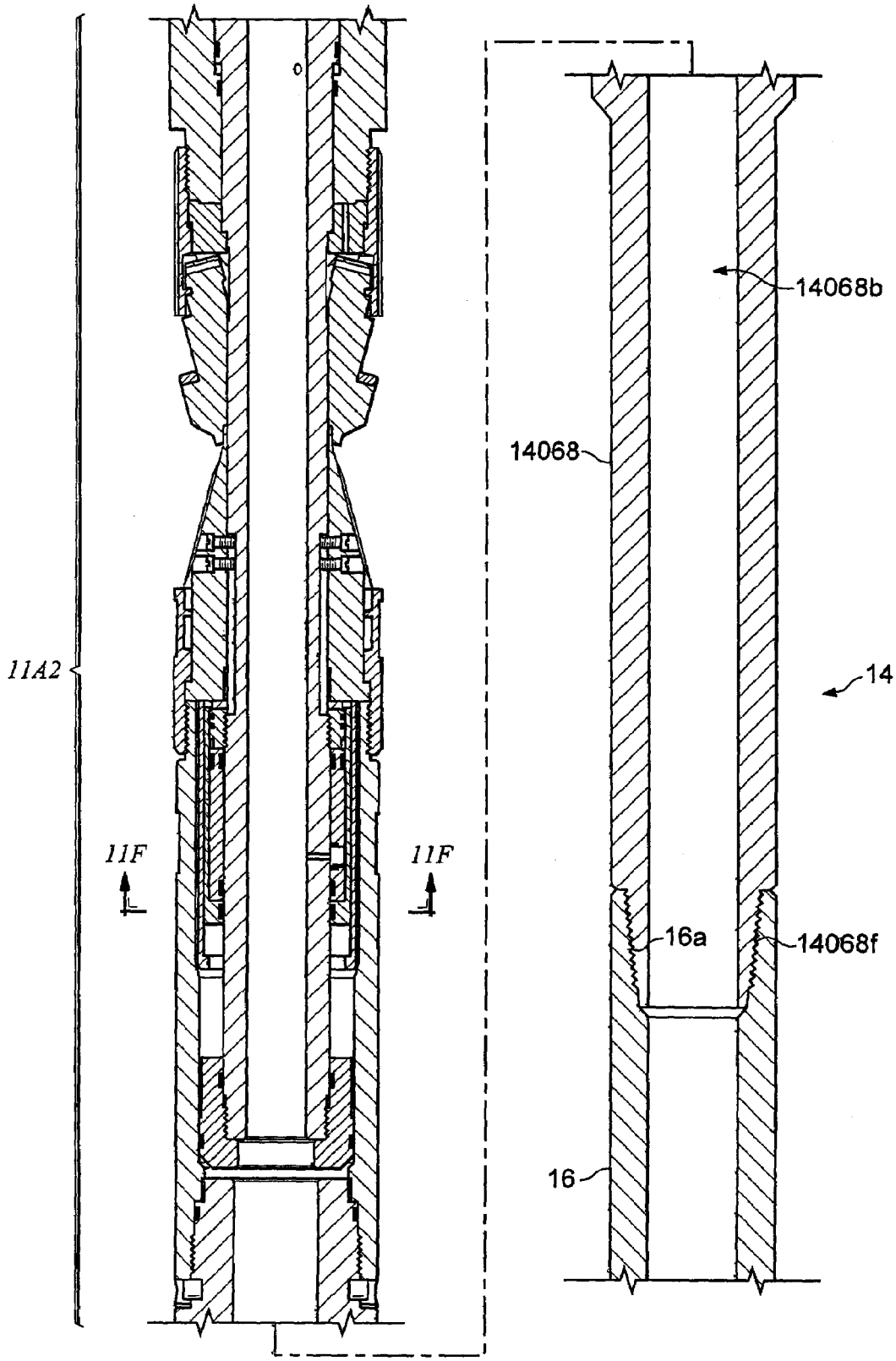
Figure 11C:
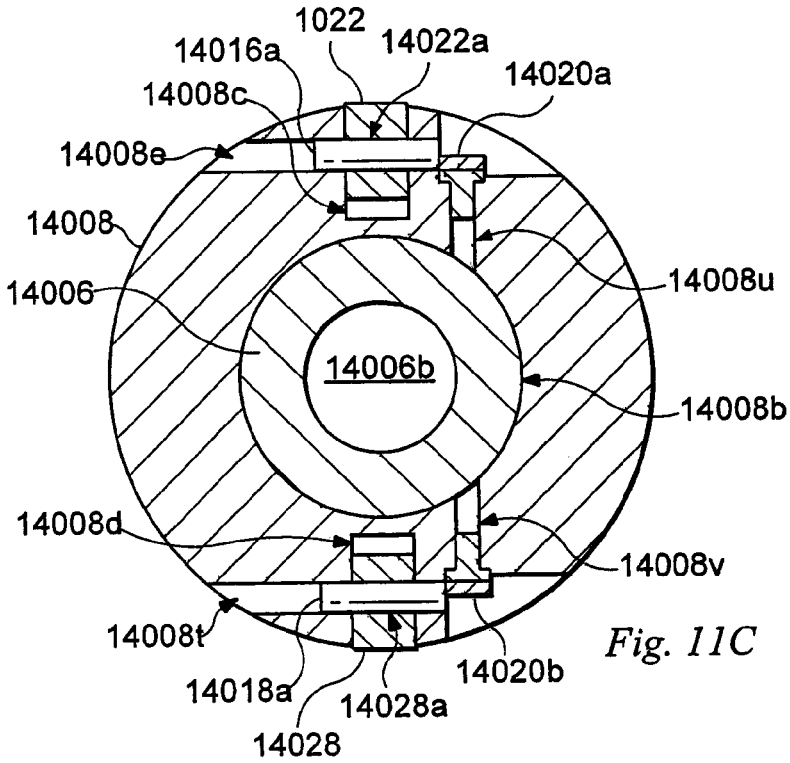
Figure 11D:
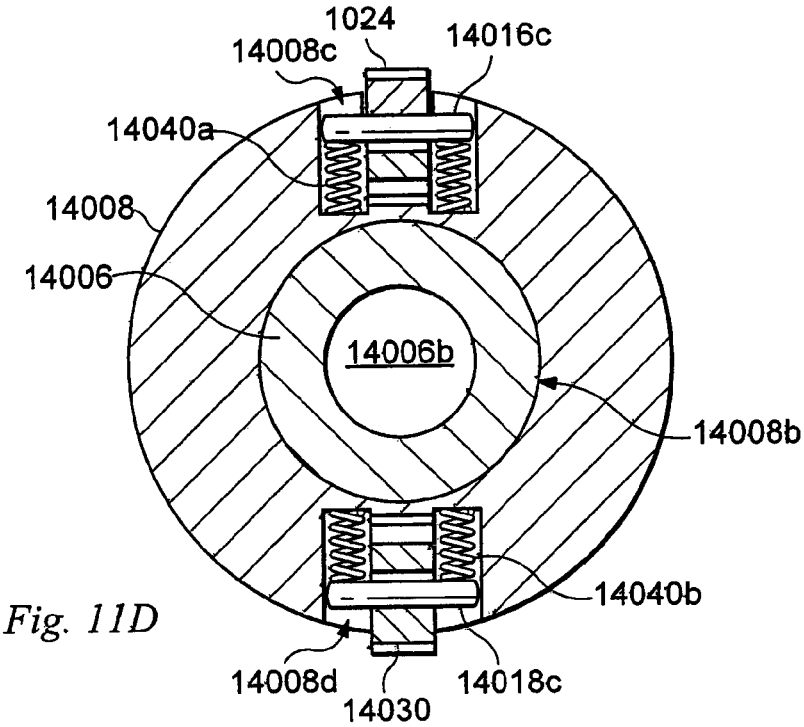
Figure 11E:
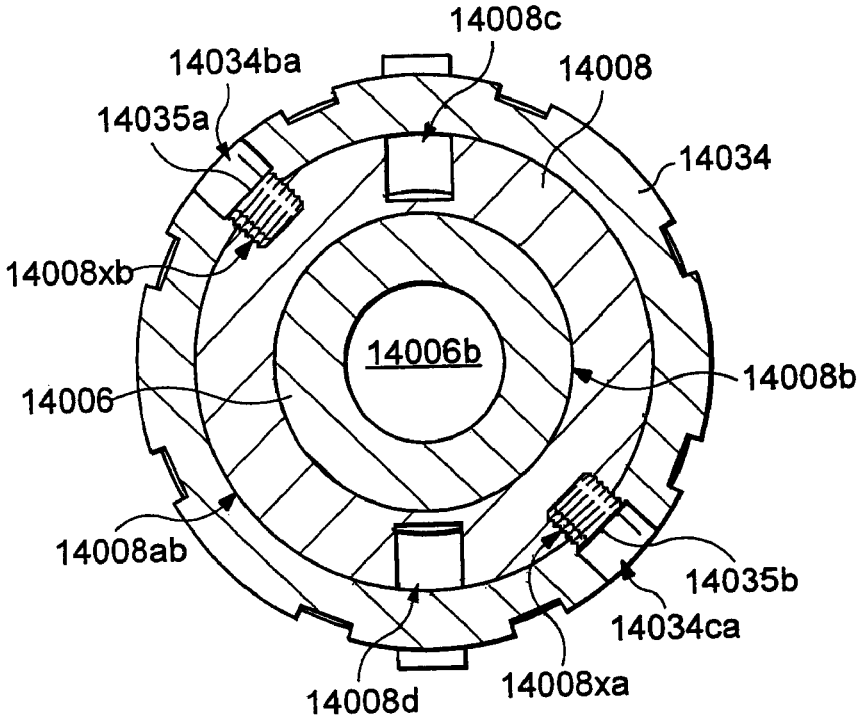
Figure 11F:
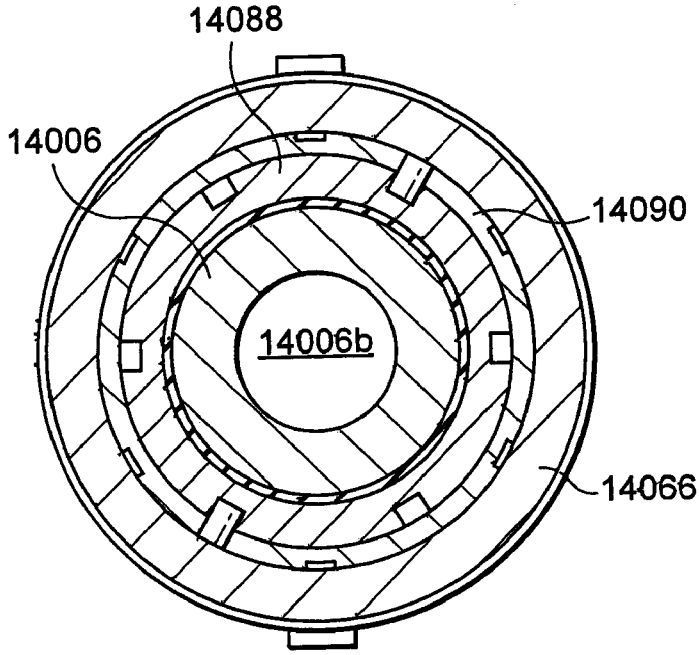
Figure 11G:
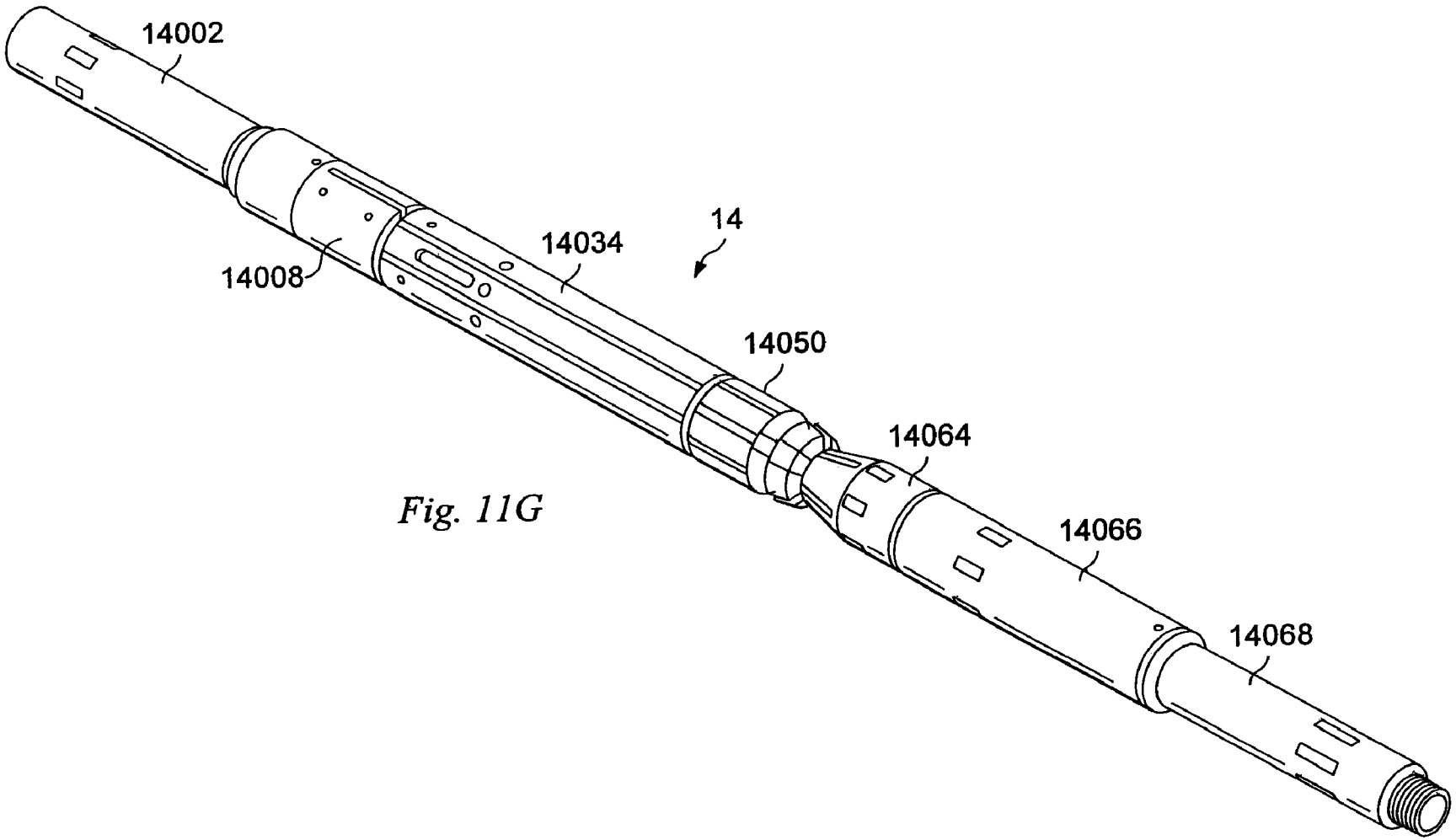
Figure 11H:
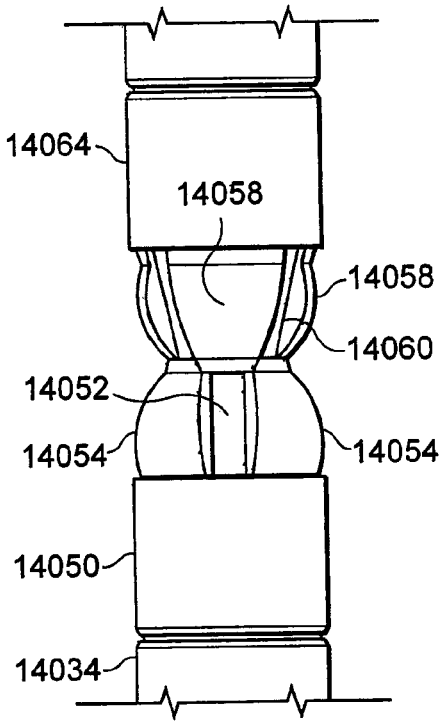
Figure 11I:
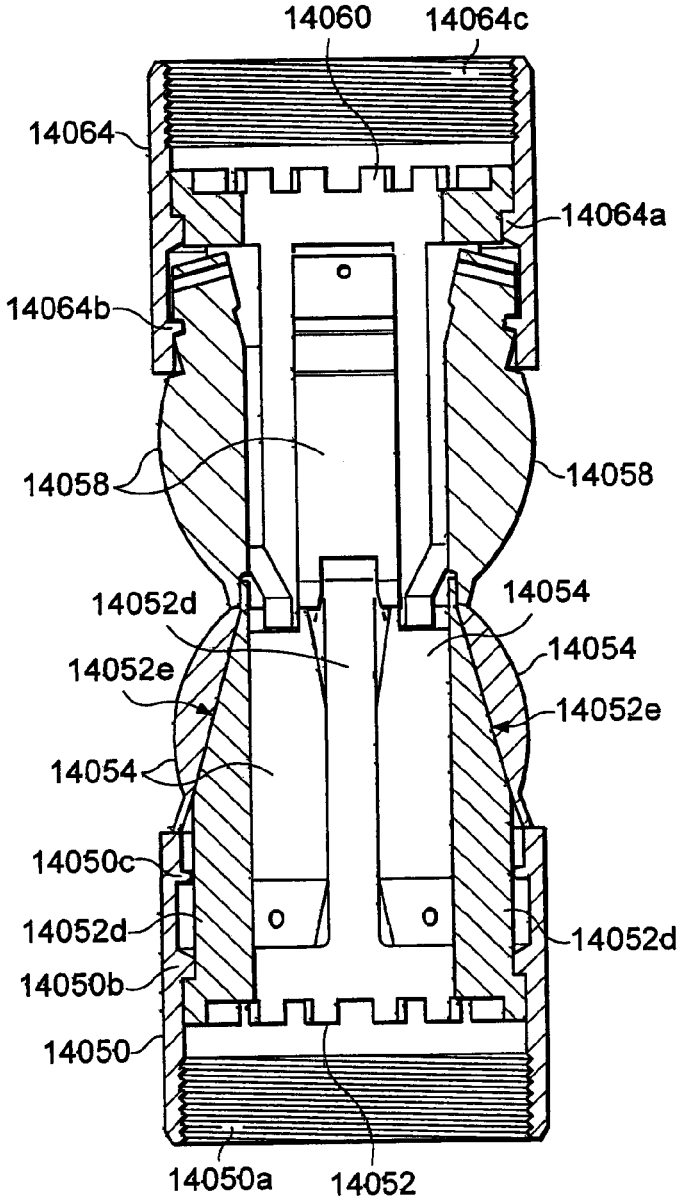
Figure 11J:
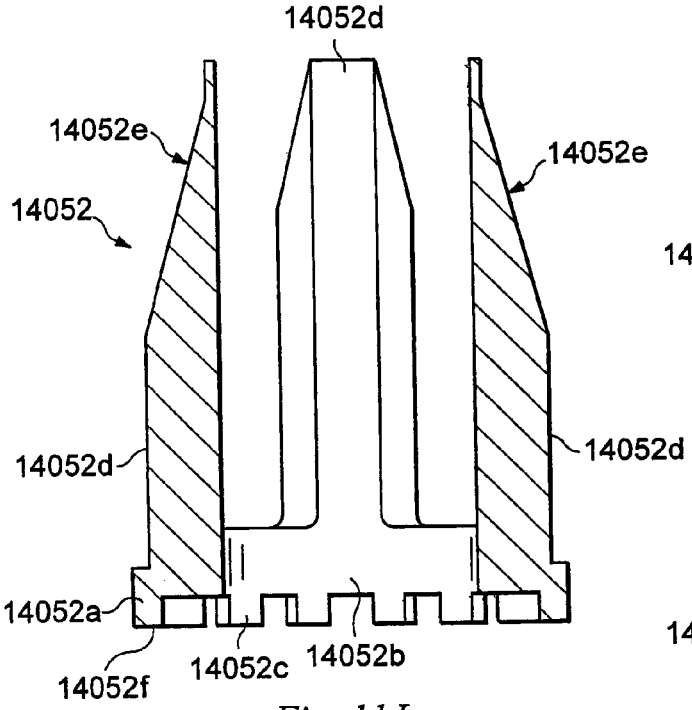
Figure 11K:
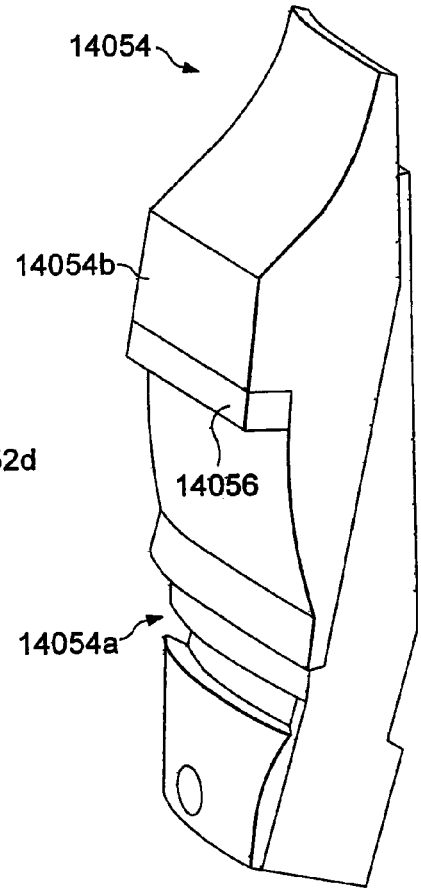
Figure 11M:
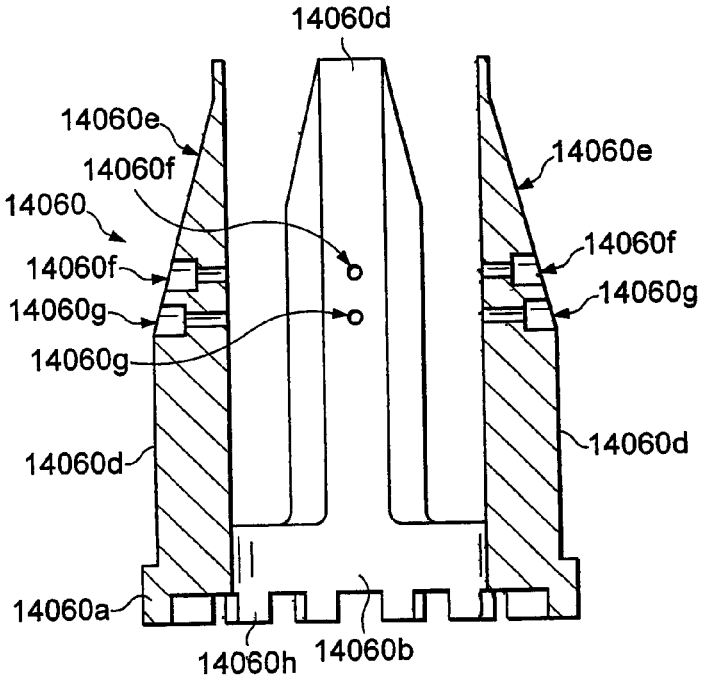
Figure 11L:
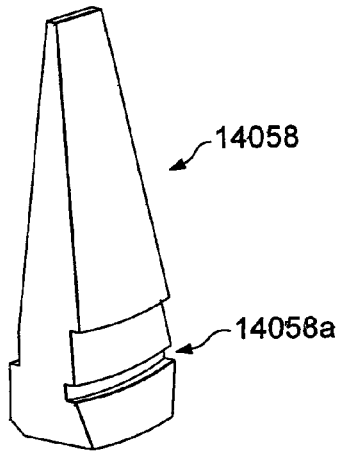
Figure 11N:
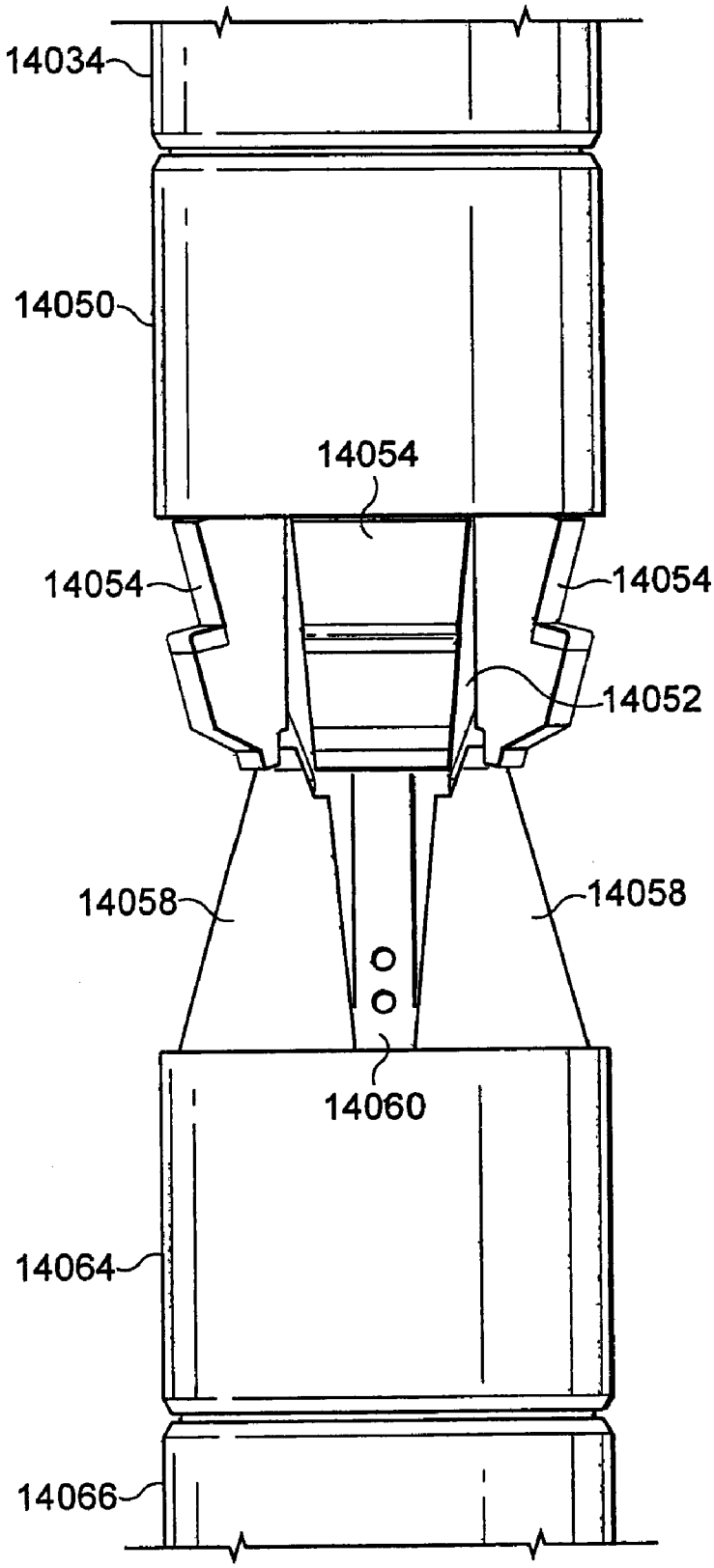
Figure 11O:
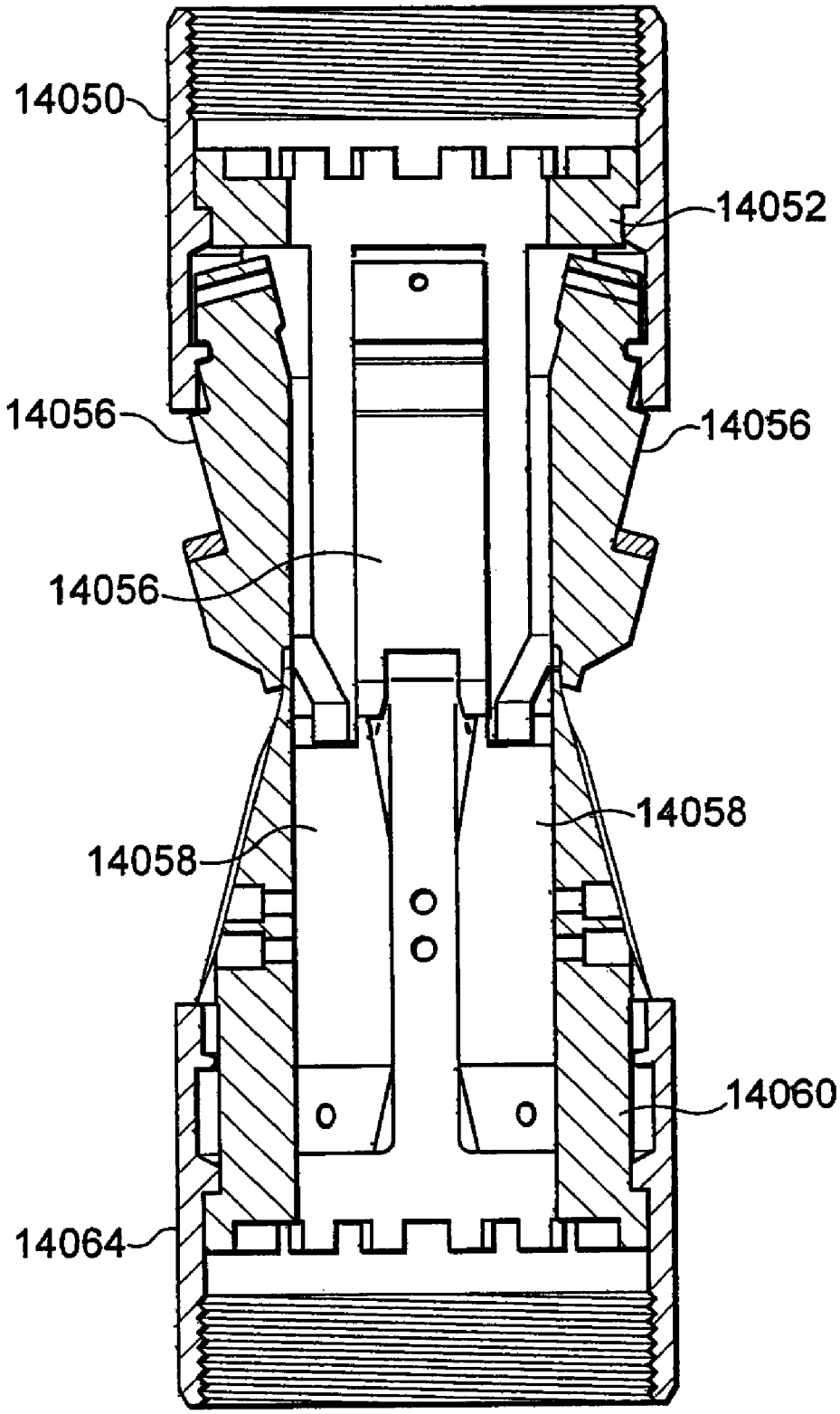
Figure 11P:
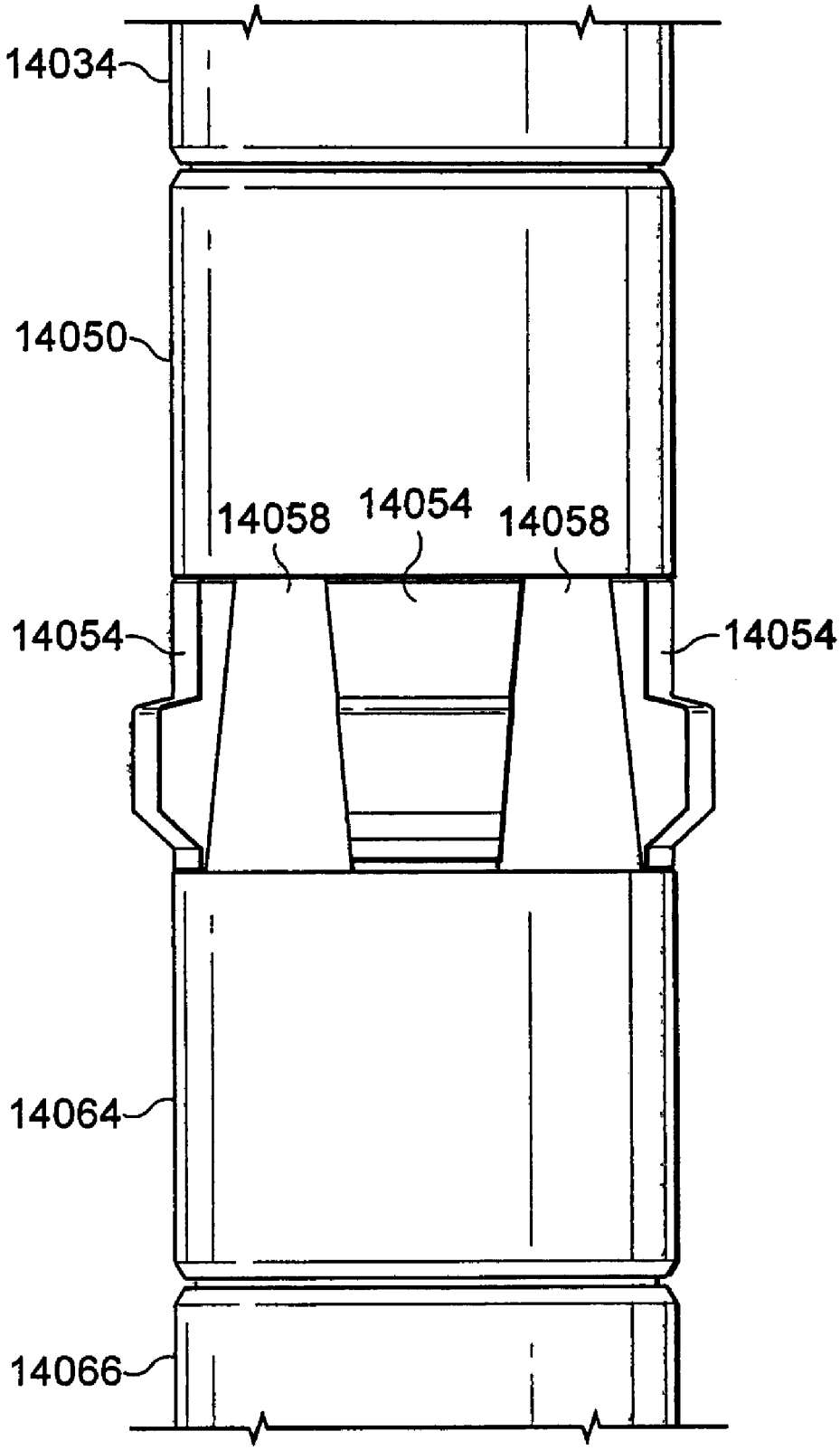
Figure 11Q:
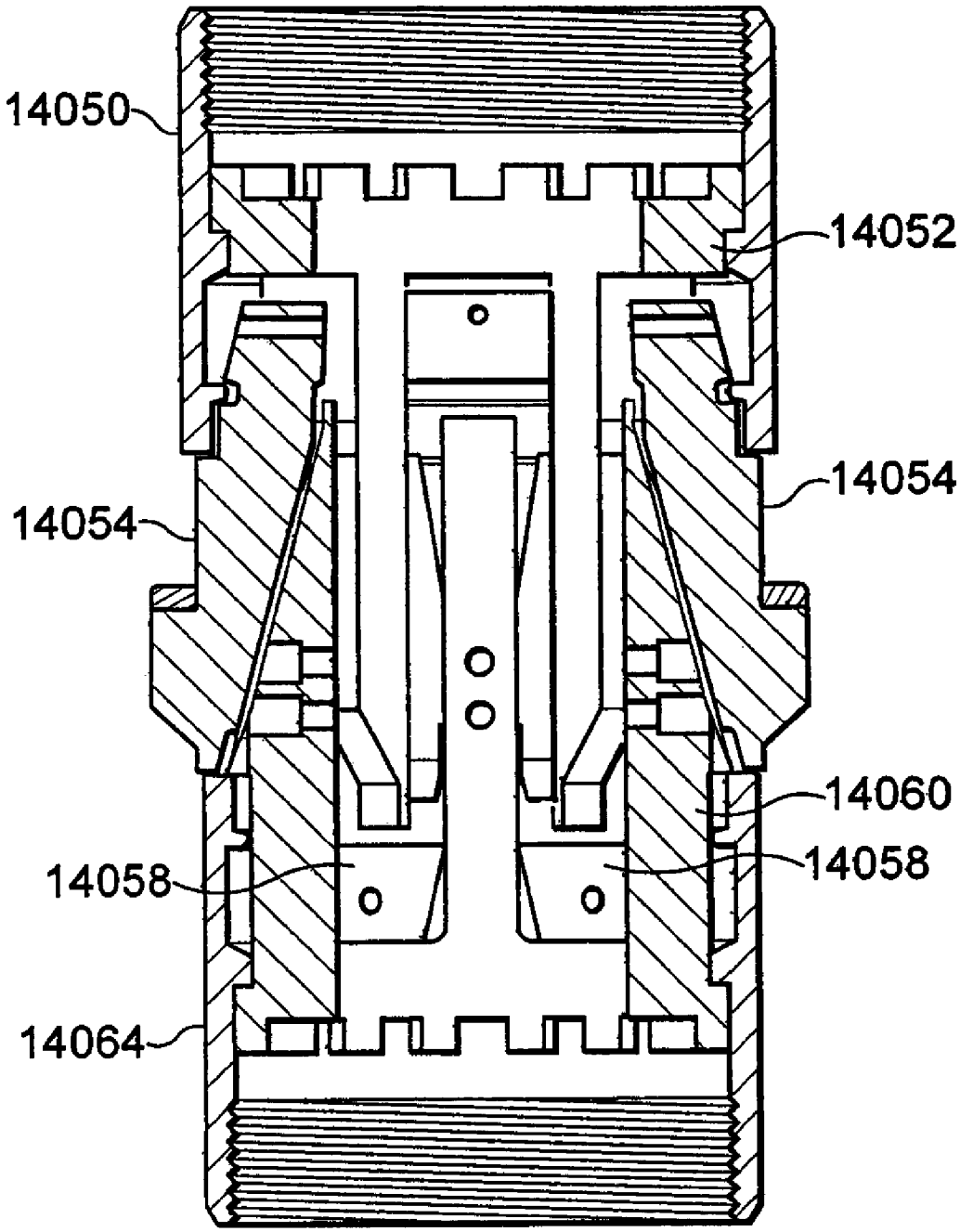
Figure 11R:
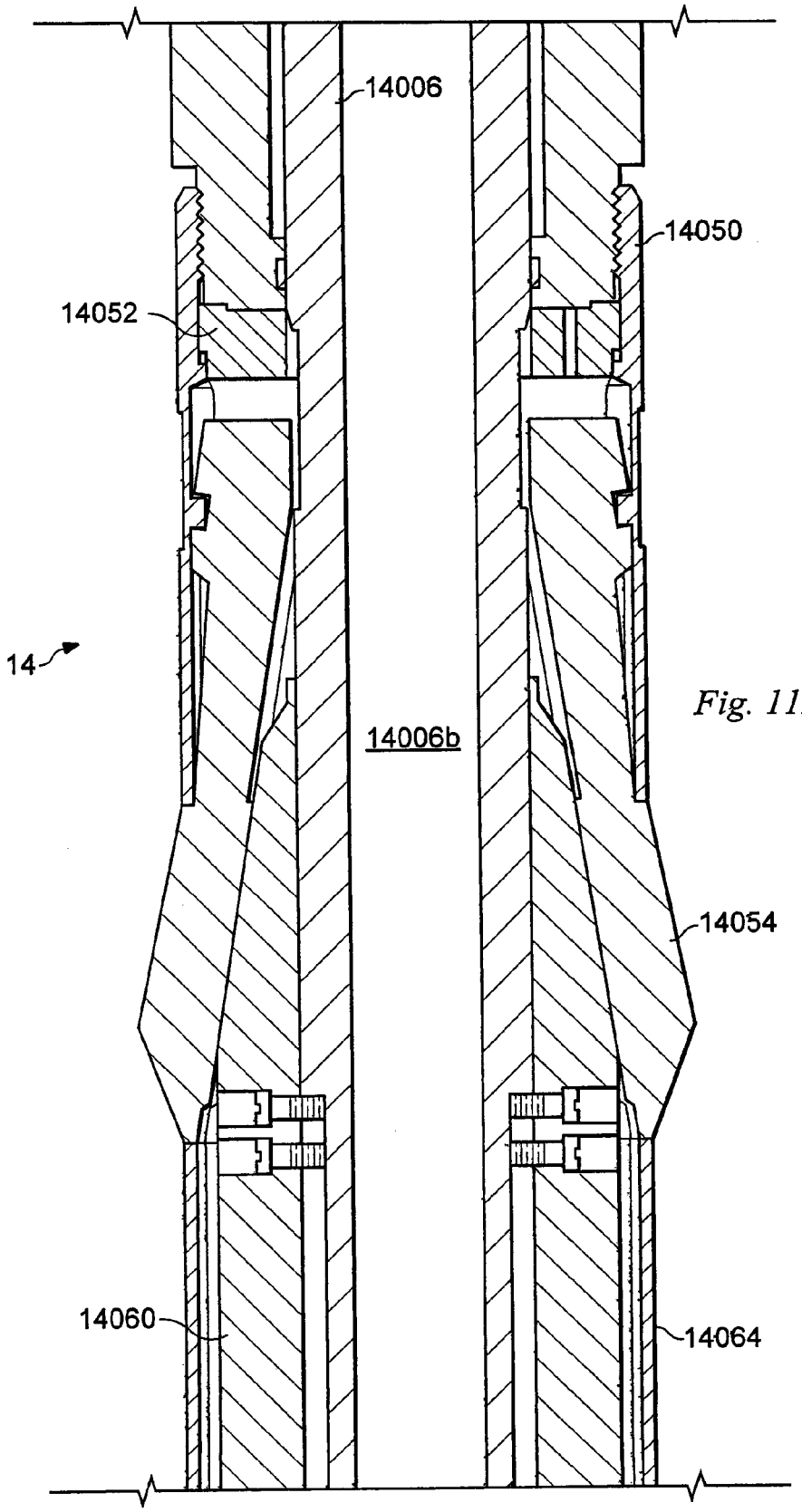
Figure 11S:
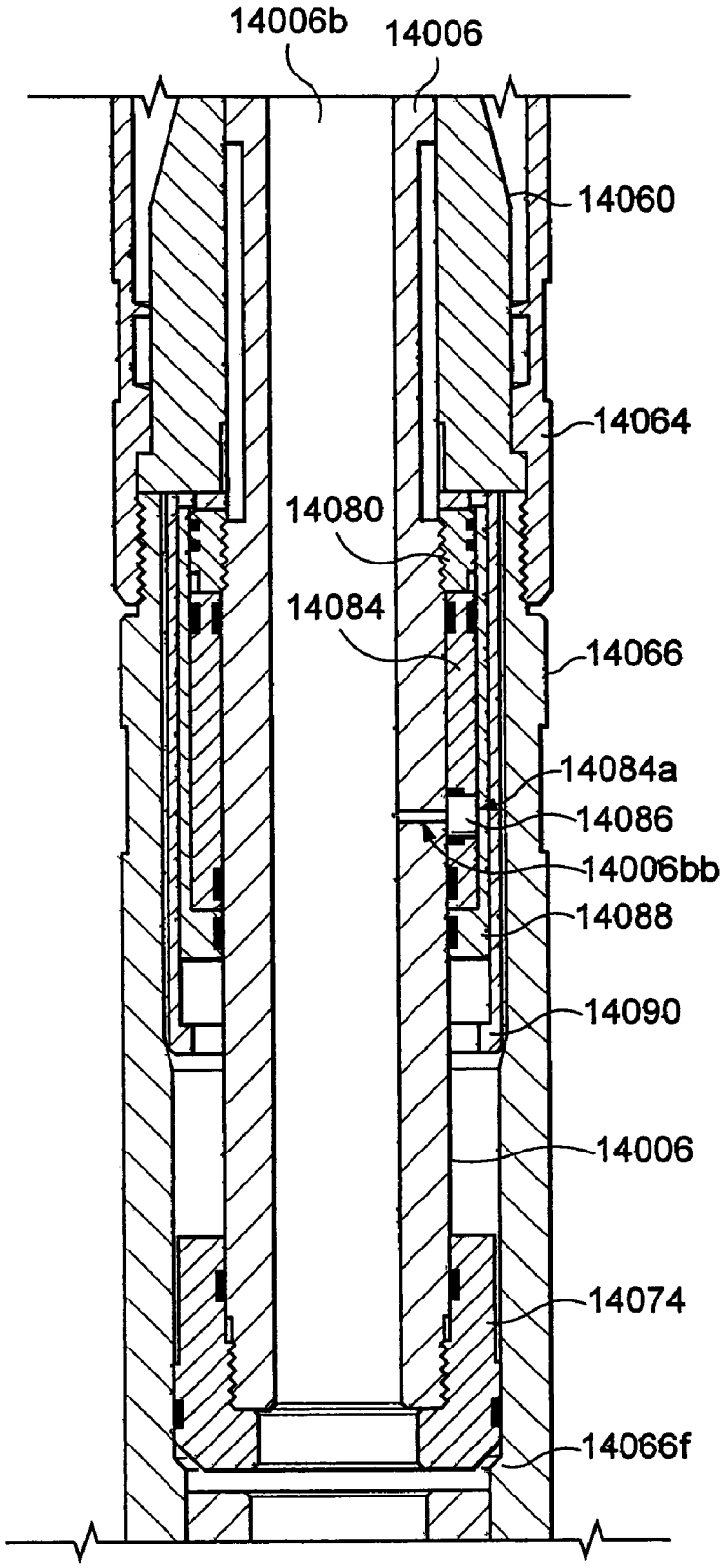

In an exemplary embodiment, as illustrated in FIGS. 11P, 11Q and 11R, the displacement of the upper cam assembly 14052 and upper casing cutter segments 14054 in the direction 14096 will cause the lower casing cutter segments 14058 to ride up the cam surfaces of the cam arms of the upper cam assembly 14052 while also pivoting about the lower tubular hinge segment 14064, and will also cause the upper casing cutter segments 14054 to ride up the cam surfaces of the cam arms of the lower cam assembly 14060 while also pivoting about the upper tubular hinge segment 14050.

In an exemplary embodiment, during the operation of the casing cutter assembly 14, when the upper and lower casing cutter segments, 14054 and 14058, brought into axial alignment in a radially expanded position, the casing cutter elements of the casing cutter segments are brought into intimate contact with the interior surface of a pre-selected portion of the expandable wellbore casing 100. The casing cutter assembly 14 may then be rotated to thereby cause the casing cutter elements to cut through the expandable wellbore casing. The portion of the expandable wellbore casing 100 cut away from the remaining portion on the expandable wellbore casing may then be carried out of the wellbore 102 with the cut away portion of the expandable wellbore casing supported by the casing cutter elements.

In an exemplary embodiment, the upper cam assembly 14052 and the upper casing cutter segments 14054 may be moved out of engagement with the lower casing cutter segments 14058 and the lower cam assembly 14060 by reducing the operating pressure within the annulus 14094.

Figure 11T:
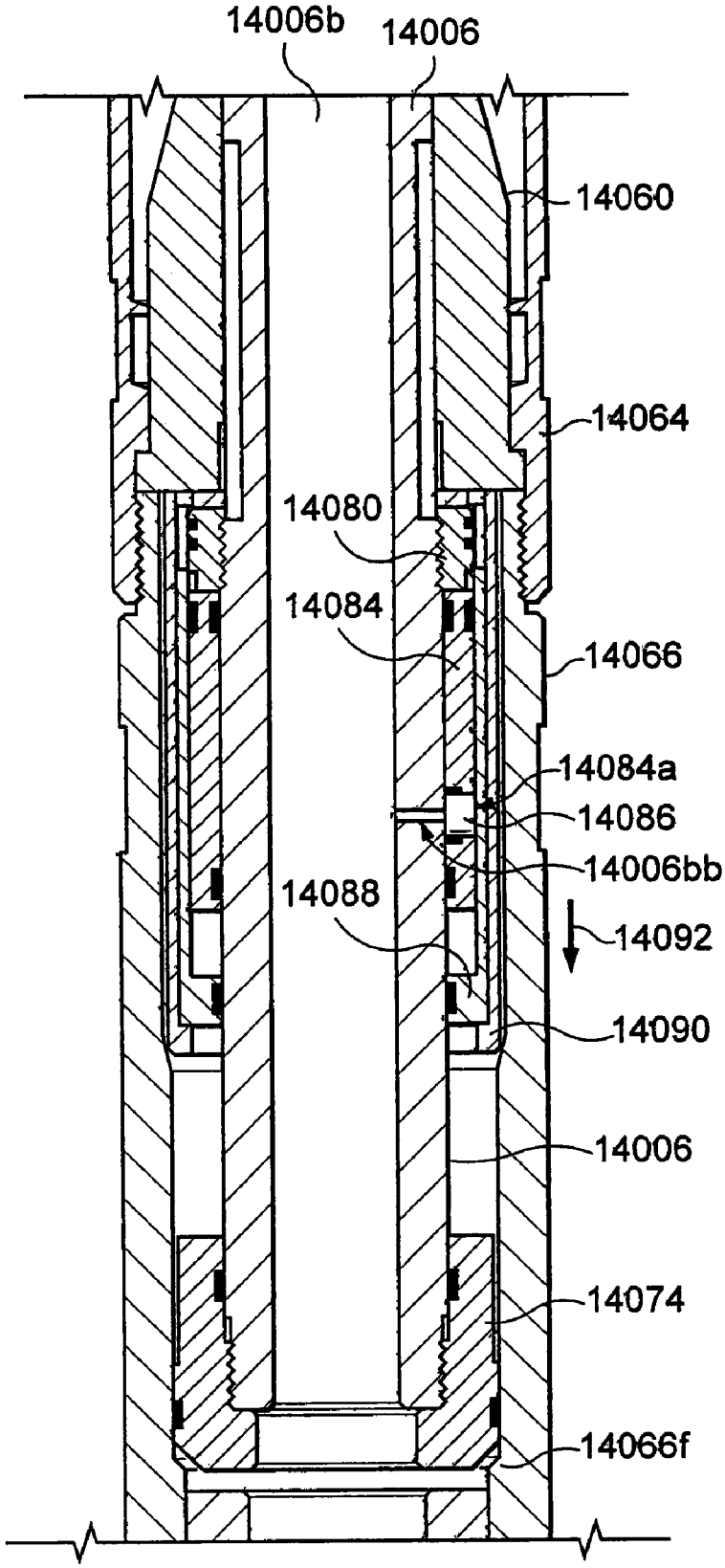

In an alternative embodiment, as illustrated in FIGS. 11S, 11T, 11U and 11V, during operation of the casing cutter assembly 14, the upper cam assembly 14052 and the upper casing cutter segments 14054 may also be moved out of engagement with the lower casing cutter segments 14058 and the lower cam assembly 14060 by sensing the operating pressure within the longitudinal passage 14006*b* of the lower tubular mandrel 14006. In particular, as illustrated in FIG. 11T, if the operating pressure within the longitudinal passage 14006*b* and radial passage 14006*bb* of the lower tubular mandrel 14006 exceeds a predetermined value, the burst disc 14086 will open the passage 14084*a* thereby pressurizing the interior of the tubular release sleeve 14088 thereby displacing the tubular release sleeve 14088 downwardly in a direction 14092 away from engagement with the locking dogs 14080.

Figure 11U:
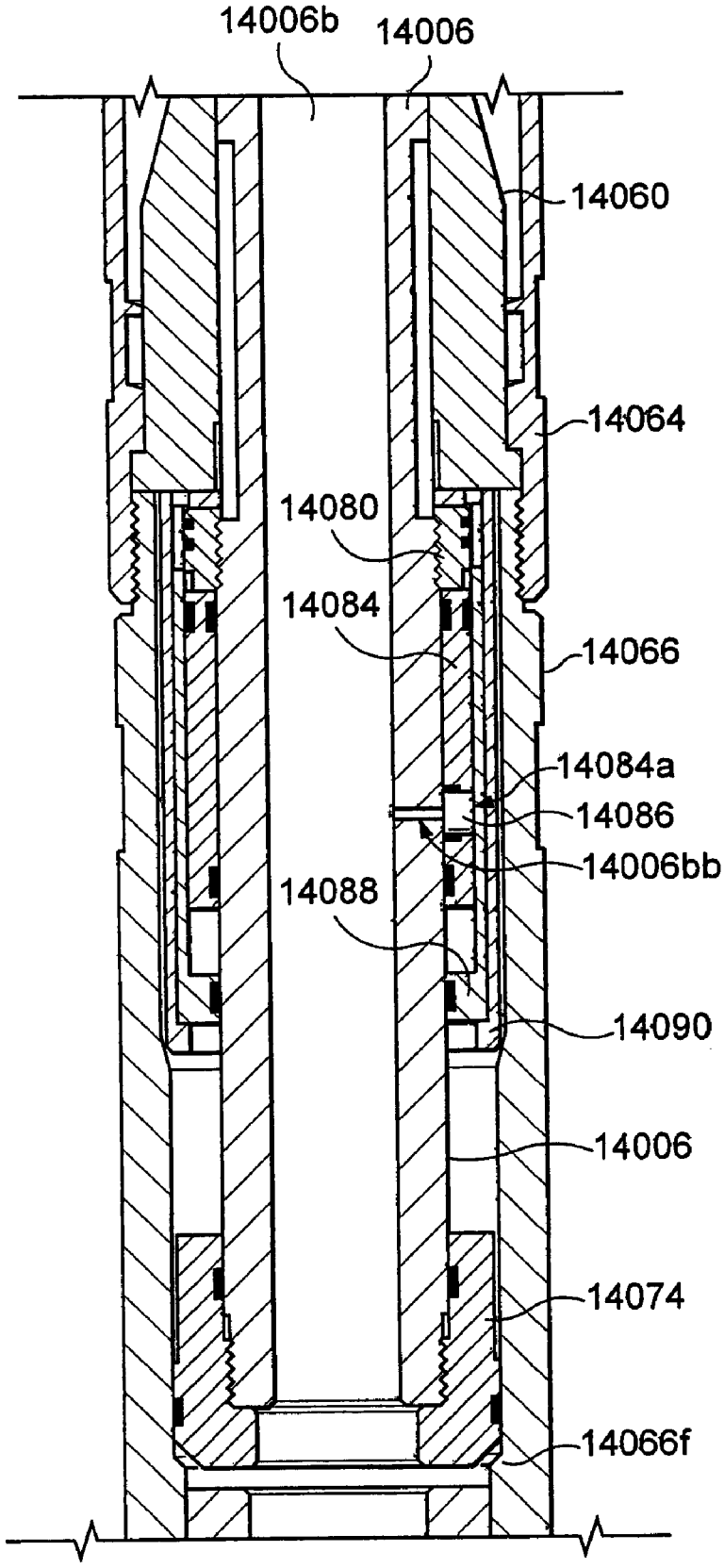

As a result, as illustrated in FIG. 11U, the locking dogs 14080 are displaced outwardly in the radial directed and thereby released from engagement with the lower tubular mandrel 14006 thereby permitting the lower casing cutter segments 14058 and the lower cam assembly 14060 to be displaced downwardly relative to the lower tubular mandrel.

Figure 11V:
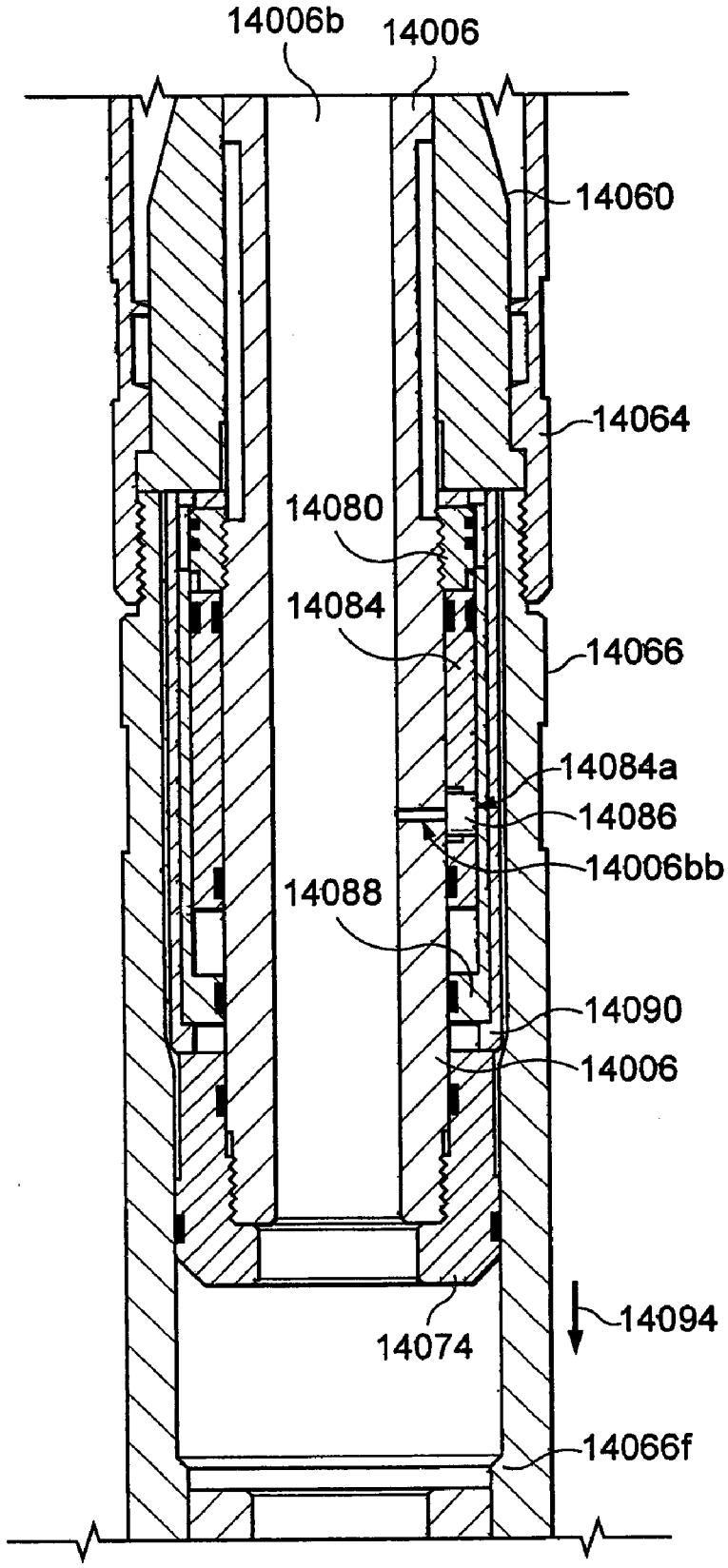

As a result, as illustrated in FIG. 11V, the operating pressure within the lower tubular mandrel 14066 may then cause the lower tubular mandrel to be displaced downwardly in the direction 14094 relative to the tubular lower mandrel 14006 and the retracting piston 14074. As a result, the lower tubular mandrel 14066, the lower casing cutter segments 14058, the lower cam assembly 14060, and tubular lower hinge sleeve 14064 are displaced downwardly in the direction 14094 relative to the tubular spring housing 14034 thereby moving the lower casing cutter segments 14058 and the lower cam assembly 14060 out of engagement with the upper cam assembly 14052 and the upper casing cutter segments 14054.

Figure 11W:
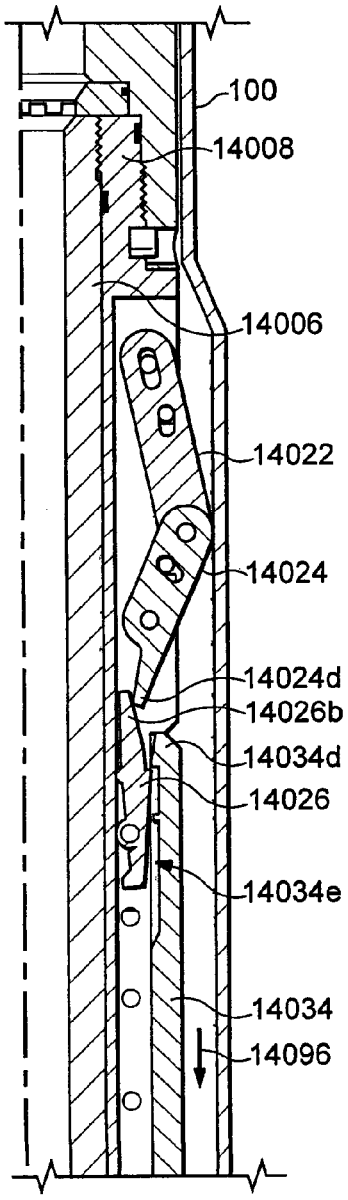
Figure 11X:
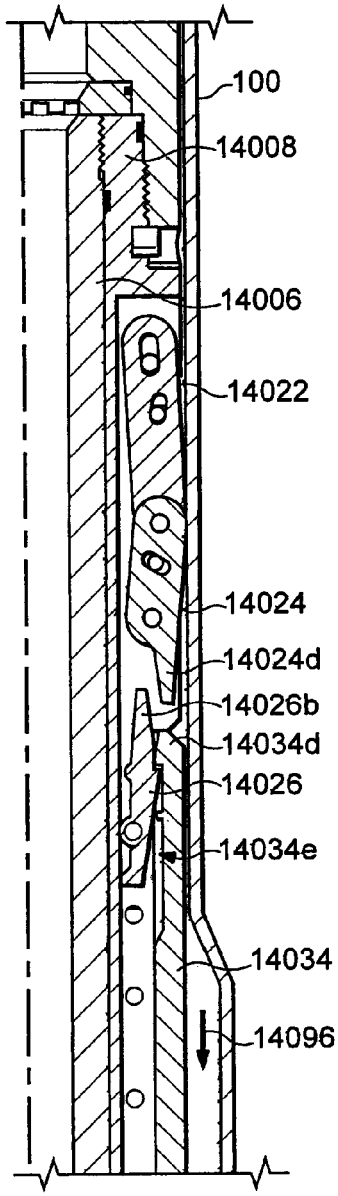
Figure 11Y:
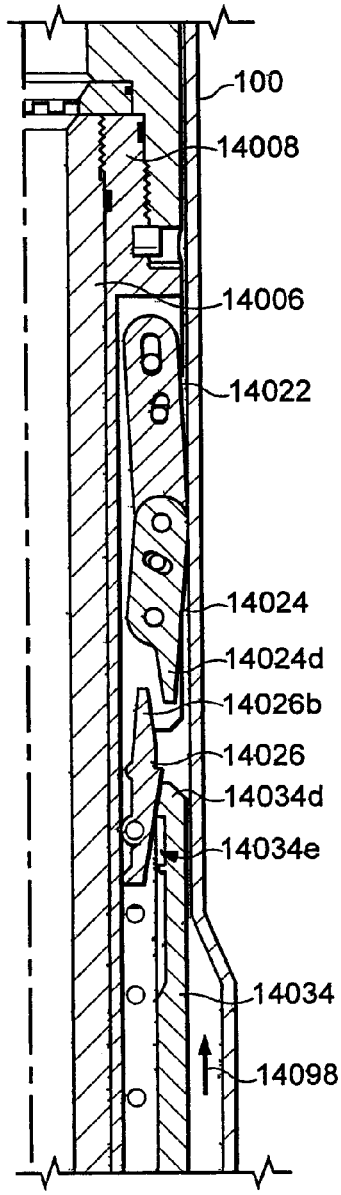

In an exemplary embodiment, as illustrated in FIGS. 11W, 11X, and 11Y, during operation of the casing cutter assembly 14, the casing cutter assembly 14 senses the diameter of the expandable wellbore casing 100 using the upper toggle links, 14022 and 14028, lower toggle links, 14024 and 14030, and triggers, 14026 and 14032, and then prevents the engagement of the upper cam assembly 14052 and the upper casing cutter segments 14054 with the lower casing cutter segments 14058 and the lower cam assembly 14060.

In particular, as illustrated in FIG. 11W, anytime the upper toggle links, 14022 and 14028, and lower toggle links, 14024 and 14030, are positioned within a portion of the expandable wellbore casing 100 that has been radially expanded and plastically deformed by the system 10, the triggers, 14026 and 14032, will be pivoted by the engagement arms, 14024*d* and 14030*d*, of the lower toggle links, 14024 and 14030, to a position in which the triggers will no longer engage the internal flange 14034*d* of the end of the tubular spring housing 14034 thereby permitting the displacement of the tubular spring housing in the direction 14096. As a result, the upper cam assembly 14052 and the upper casing cutter segments 14054 can be brought into engagement with the lower casing cutter segments 14058 and the lower cam assembly 14060. In an exemplary embodiment, the upper toggle links, 14022 and 14028, and the lower toggle links, 14024 and 14030, are spring biased towards the position illustrated in FIG. 11W.

Conversely, as illustrated in FIG. 11X, anytime the upper toggle links, 14022 and 14028, and lower toggle links, 14024 and 14030, are positioned within a portion of the expandable wellbore casing 100 that has not been radially expanded and plastically deformed by the system 10, the triggers, 14026 and 14032, will be maintained in a position in which the triggers will engage the internal flange 14034*d* of the end of the tubular spring housing 14034 thereby preventing the displacement of the tubular spring housing in the direction 14096. As a result, the upper cam assembly 14052 and the upper casing cutter segments 14054 cannot be brought into engagement with the lower casing cutter segments 14058 and the lower cam assembly 14060. In an exemplary embodiment, the triggers, 14026 and 14032, are spring biased towards the position illustrated in FIG. 11X.

In an exemplary embodiment, as illustrated in FIG. 11Y, the tubular spring housing 14034 may be displaced upwardly in the direction 14098 even if the upper toggle links, 14022 and 14028, and lower toggle links, 14024 and 14030, are positioned within a portion of the expandable wellbore casing 100 that has not been radially expanded and plastically deformed by the system 10.

In an exemplary embodiment, as illustrated in FIGS. 11Z1 to 11Z4, 11AA1 to 11AA4, 11AB1 to 11AB4, 11AC1 to 11AC4, 11AD, and 11AE, the tubular spring housing 14034 of the casing cutter assembly 14 defines internal annular recesses 14034*k* and 140341, spaced apart by an internal flange 14034*m*, the tubular toggle bushing 14008 defines an external annular recess 14008*ac*, and the casing cutter assembly further includes pins, 14100*a* and 14100*b* and 14102*a* and 14102*b*, mounted in holes 14008*j* and 14008*o* and 14008*k* and 14008*n*, respectively, of the tubular toggle bushing, and a one-shot deactivation device 14104 mounted on the tubular toggle bushing between the pins, 14100*a* and 14100*b* and 14102*a* and 14102*b*.

The one-shot deactivation device 14104 includes a tubular body 14104*a* that defines radial holes, 14104*b* and 14014*c*, and includes an external annular recess 14104*d* at one end, a centrally positioned external flange 14104*e*, a centrally positioned internal annular recess 14104*f*, and an external annular recess 14104*g* at another end. An engagement member 14106 that includes a base member 14106*a* having a tapered end 14106*b* and a key member 14106*c* having a tapered end 14106*d* is received within a portion of the internal annular recess 14104*f* of the tubular body 14104*a* and an engagement member 14108 that includes a base member 14108*a* having a tapered end 14108*b* and a key member 14108*c* having a tapered end 14108*d* is received within an opposite portion of the internal annular recess 14104*f* of the tubular body 14104*a*. Spring members, 14110 and 14112, are received within the annular recess 14104*f* of the tubular body 14104*a* for biasing the base members, base member 14106*a* and 14108*a*, of the engagement members, 14106 and 14108, respectively, radially inwardly relative to the tubular body 14104*a*.

In an exemplary embodiment, during operation of the casing cutter assembly 14, as illustrated in FIGS. 11Z1 to 11Z4, the one-shot deactivation device 14104 are positioned proximate and in intimate contact with the pins, 14102*a* and 14102*b*, with the tapered ends, 14106*b* and 14108*b*, of the base members, 14106*a* and 14108*a*, of the engagement members, 14106 and 14108, received within the external annular recess 14008*ac* of the tubular toggle bushing 14008. When the one-shot deactivation device 14104 is positioned as illustrated in FIG. 11Z, the external annular recess 14104*d* of the tubular body 14104*a* of the one-shot deactivation device is moved out of engagement with the engagement arms, 14026*d* and 14032*d*, of the triggers, 14026 and 14032, respectively. As a result, the triggers, 14026 and 14032, may operate normally as described above with reference to FIGS. 11W, 11X, and 11Y.

Figure 11A:
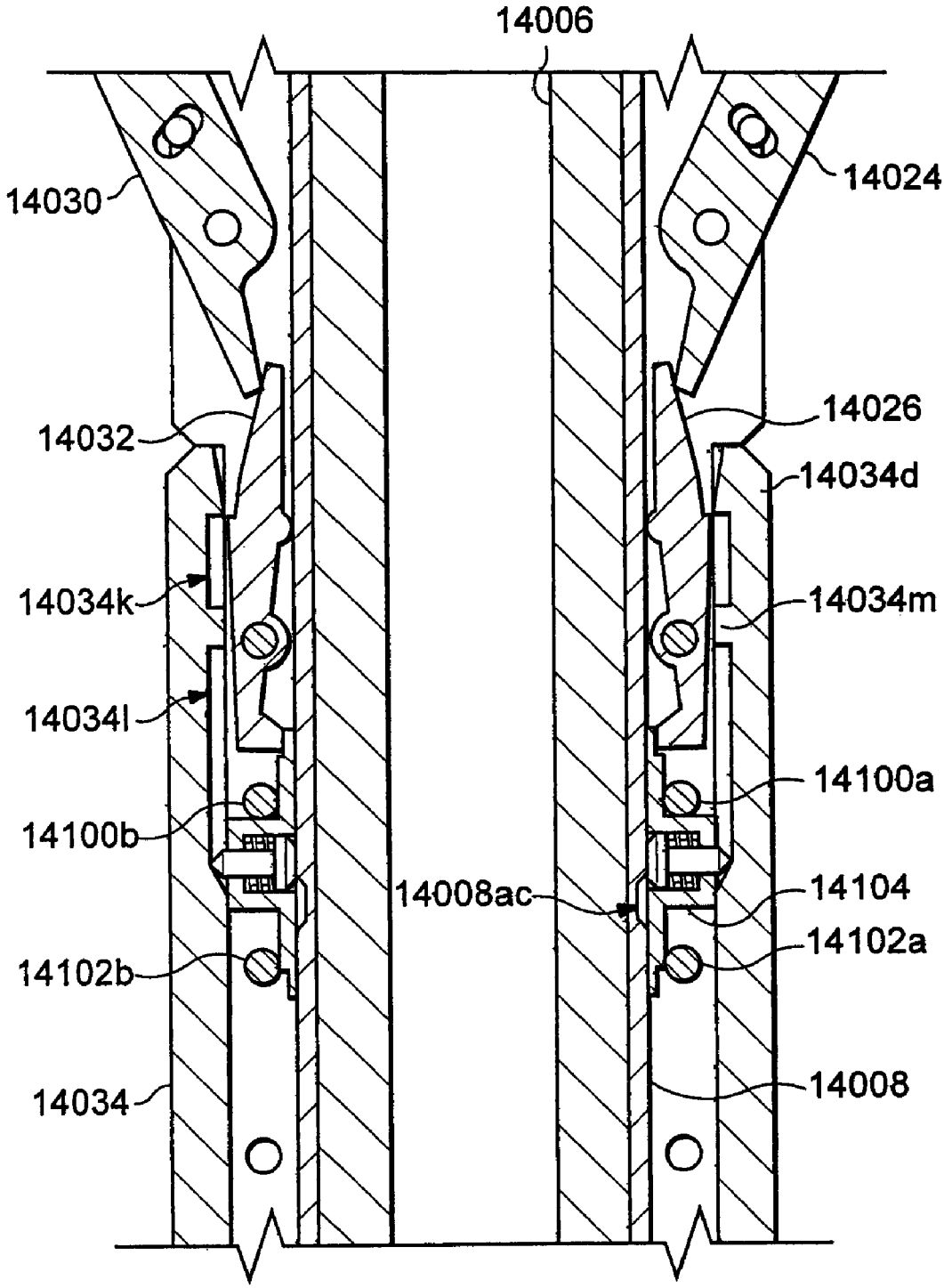
Figure 11A:
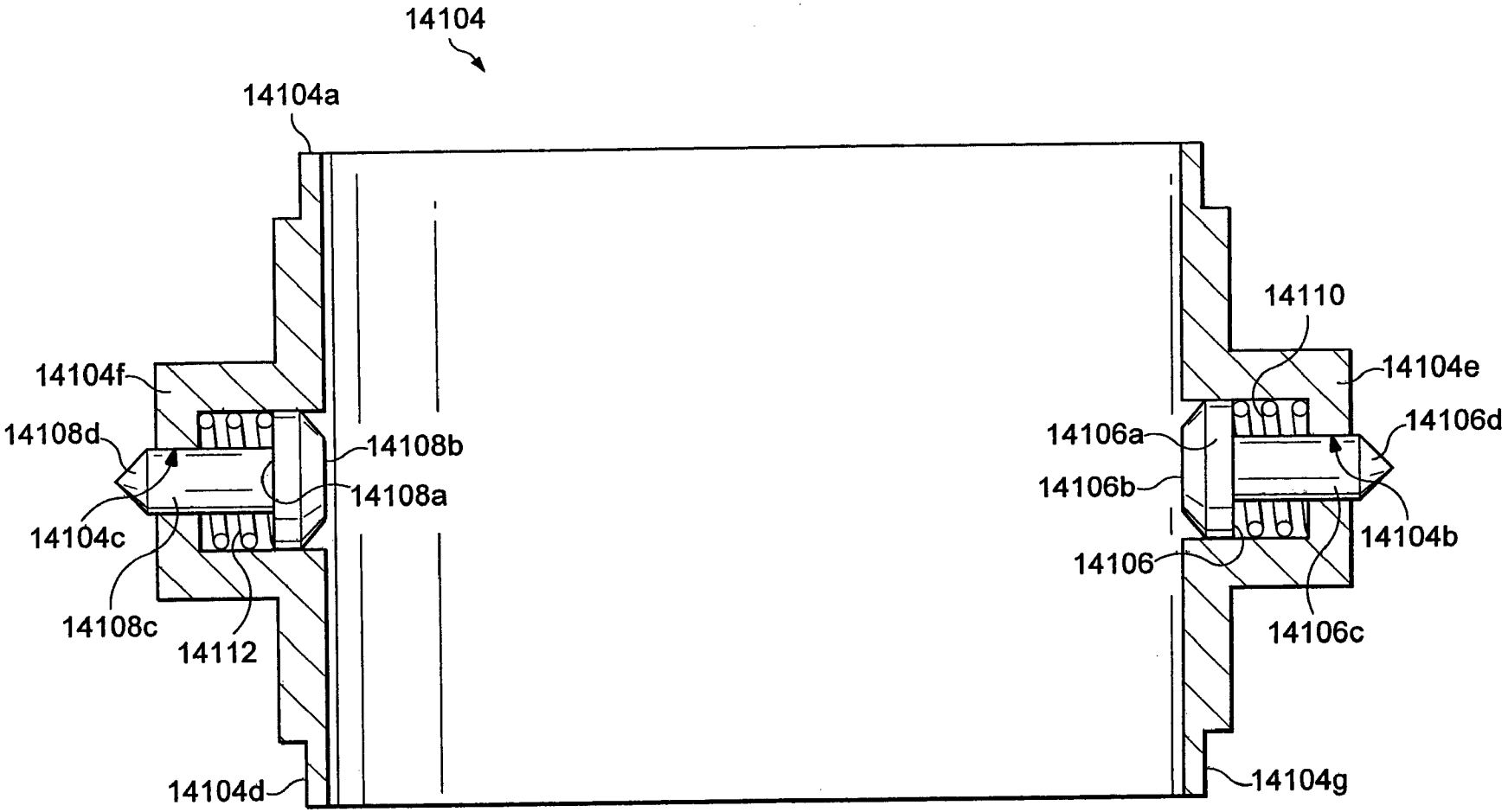

Conversely, in an exemplary embodiment, during operation of the casing cutter assembly 14, as illustrated in FIGS. 11AA1 to 11AA4, the one-shot deactivation device 14104 are positioned proximate and in intimate contact with the pins, 14100*a* and 14100*b*, with the tapered ends, 14106*b* and 14108*b*, of the base members, 14106*a* and 14108*a*, of the engagement members, 14106 and 14108, not received within the external annular recess 14008*ac* of the tubular toggle bushing 14008. When the one-shot deactivation device 14104 is positioned as illustrated in FIGS. 11AA1 to 11AA4, the external annular recess 14104*d* of the tubular body 14104*a* of the one-shot deactivation device is moved into engagement with the engagement arms, 14026*d* and 14032*d*, of the triggers, 14026 and 14032, respectively. As a result, the triggers, 14026 and 14032, are deactivated and may not operate normally as described above with reference to FIGS. 11W, 11X, and 11Y.

In an alternative embodiment, the elements of the casing cutter assembly 14 that sense the diameter of the expandable wellbore casing 100 may be disabled or omitted or adjusted to sense any pre-selected internal diameter of the expandable wellbore casing.

In an exemplary embodiment, the ball gripper assembly 16 is provided and operates substantially, at least in part, as disclosed in one or more of the following: (1) PCT patent application Ser. No. PCT/US03/29859, filed on Sep. 22, 2003, (2) PCT patent application Ser. No. PCT/US03/14153, filed on Nov. 13, 2003, and/or (3) PCT patent application Ser. No. PCT/US04/07711, filed on Mar. 11, 2004, and/or (4) PCT patent application Ser. No. PCT/US04/009434, filed on Mar. 26, 2004, and/or (5) PCT patent application Ser. No. PCT/US04/010317, filed on Apr. 2, 2004, and/or (6) PCT patent application Ser. No. PCT/US04/010712, filed on Apr. 7, 2004, and/or (7) PCT patent application Ser. No. PCT/US04/010762, filed on Apr. 6, 2004, and/or PCT application Ser. No. PCT/US04/011973, filed on Apr. 15, 2004, the disclosures of which are incorporated herein by reference.

In an exemplary embodiment, as illustrated in FIGS. 12A1 to 12A4, 12B and 12C1 to 12C4, the ball gripper assembly 16 includes an upper mandrel 1602 that defines a longitudinal passage 1602*a* and a radial passage 1602*b* and includes an internal threaded connection 1602*c* at one end, an external flange 1602*d* at an intermediate portion that includes an external annular recess 1602*e* having a shoulder 1602*f* and an external radial hole 1602*g*, an external annular recess 1602*h*, an external annular recess 1602*i*, an external annular recess 1602*j* having a tapered end 1602*k* including an external annular recess 1602*ka*, an external annular recess 16021, and an external annular recess 1602*m*, and an external annular recess 1602*n*, an external radial hole 1602*o*, an external annular recess 1602*p*, and an external annular recess 1602*q* at another end.

An upper tubular bushing 1604 defines an internally threaded radial opening 1604*a* and includes an external flange 1604*b* having an external annular recess 1604*c* and an internal annular recess 1604*d* mates with and receives the external flange 1602*d* of the upper mandrel 1602. In particular, the internal annular recess 1604*d* of the upper tubular bushing 1604 mates with the shoulder 1602*f* of the external annular recess 1602*e* of the upper mandrel 1602. A screw 1606 that is threadably coupled to the internally threaded radial opening 1604*a* of the upper tubular bushing 1604 extends into the external radial hole 1602*g* of the external flange 1602*d* of the upper mandrel 1602.

A deactivation tubular sleeve 1608 defines a radial passage 1608*a* and includes an internal annular recess 1608*b* that mates with and receives an end of the external annular recess 1604*c* of the external flange 1604*b* of the upper tubular bushing 1604, an internal annular recess 1608*c* that mates with and receives the external flange 1602*d* of the upper mandrel 1602, an internal annular recess 1608*d*, an internal annular recess 1608*e*, and an internal annular recess 1608*f*. A deactivation spring 1610 is received within an annulus 1612 defined between the internal annular recess 1608*b* of the deactivation tubular sleeve 1608, an end face of the external annular recess 1604*c* of the external flange 1604*b* of the upper tubular bushing 1604, and the external annular recess 1602*h* of the external flange 1602*d* of the upper mandrel 1602.

A sealing member 1614 is received with the external annular recess 1602*i* of the external flange 1602*d* of the upper mandrel 1602 for sealing the interface between the upper mandrel and the deactivation tubular sleeve 1608. An annular spacer element 1616 is received within the external annular recess 1602*ka* of the tapered end 1602*k* of the external annular recess 1602*j* of the upper mandrel 1602.

One or more inner engagement elements 1618*a* of a tubular coglet 1618 engage and are received within the external annular recess 1602*ka* of the tapered end 1602*k* of the external annular recess 1602*j* of the upper mandrel 1602 and one or more outer engagement elements 1618*b* of the coglet engage and are received within the internal annular recess 1608*d* of the deactivation tubular sleeve 1608.

An external annular recess 1620*a* of an end of a tubular coglet prop 1620 that includes an inner flange 1620*b* receives and mates with the inner surfaces of the outer engagement elements 1618*b* of the coglet 1618. The end of the tubular coglet prop 1620 further receives and mates with the external annular recess 1602*j* of the external flange 1602*d* of the upper mandrel 1602. A sealing element 1622 is received within the external annular recess 16021 of the upper mandrel 1602 for sealing the interface between the upper mandrel and the tubular coglet prop 1620.

An end of a tubular bumper sleeve 1624 that includes internal and external flanges, 1624*a* and 1624*b*, and a hole 1624*c* at another end mates with and receives the external annular recess 1602*m* of the external flange 1602*d* of the upper mandrel 1602. A coglet spring 1626 is received within an annulus 1628 defined between the external annular recess 1602*m* of the external flange 1602*d* of the upper mandrel 1602, the tubular coglet prop 1620, the inner flange 1620*b* of the tubular coglet prop, an end face of the tubular bumper sleeve 1624, and the internal annular recess 1608*c* of the deactivation tubular sleeve 1608.

A tubular ball race 1628 that defines a plurality of tapered annular recesses 1628*a* and an internally threaded radial opening 1628*b* and includes one or more axial engagement elements 1628*c* at one end and one or more axial engagement elements 1628*d* at another end receives and mates with the other end of the upper mandrel 1602. In an exemplary embodiment, the axial engagement elements 1628*c* of the tubular ball race 1628 are received within and are coupled to the hole 1624*c* of the tubular bumper sleeve 1624. An end of a tubular activation sleeve 1630 that defines a plurality of radial openings 1630*a*, a radial opening 1630*b*, a radial opening 1630*c*, and includes an internal annular recess 1630*d* receives and mates with the tubular ball race 1628. In an exemplary embodiment, an end face of an end of the tubular activation sleeve 1630 is positioned proximate and in opposing relation to an end face of an end of the deactivation sleeve 1608. In an exemplary embodiment, the radial openings 1630*a* are aligned with and positioned in opposing relation to corresponding of tapered annular recesses 1628*a* of the tubular ball race 1628, and the radial openings are also narrowed in cross section in the radial direction for reasons to be described.

Balls 1632 are received within each of the of tapered annular recesses 1628*a* and corresponding radial openings 1630*a* of the tubular ball race 1628 and tubular activation sleeve 1630, respectively. In an exemplary embodiment, the narrowed cross sections of the radial openings 1630*a* of the tubular activation sleeve 1630 will permit the balls 1632 to be displaced outwardly in the radial direction until at least a portion of the balls extends beyond the outer perimeter of the tubular activation sleeve to thereby permit engagement of the balls with an outer structure such as, for example, a wellbore casing.

A lower mandrel 1634 that defines a longitudinal passage 1634*a* and an internally threaded radial passage 1634*b* at one end and includes internal annular recesses, 1634*c* and 1634*d*, for receiving and mating with the external annular recesses, 1602*p* and 1602*q*, of the upper mandrel 1602, an internal annular recess 1634*e*, an external flange 1634*f*, and an externally threaded connection 1634*g* at another end. In an exemplary embodiment, as illustrated in FIG. 12B, the end of the lower mandrel 1634 further includes longitudinal recesses 1634*h* for receiving and mating with corresponding axial engagement elements 1628*d* of the tubular ball race 1628. A sealing element 1635 is received within the internal annular recess 1634*d* of the lower mandrel 1634 for sealing an interface between the lower mandrel and the external annular recess 1602*p* of the upper mandrel 1602.

A tubular spring retainer 1636 that defines a radial passage 1636*a* and includes an external annular recess 1636*b* at one end mates with and receives the end of the lower mandrel 1634 and is positioned proximate an end face of the external flange 1634*f* of the lower mandrel. A tubular spring retainer 1638 receives and mates with the end of the lower mandrel 1634 and is received and mates with the internal annular recess 1630*d* of the tubular activation sleeve 1630.

An activation spring 1640 is received within an annulus 1642 defined an end face of the tubular spring retainer 1638, an end face of the spring retainer 1636, the internal annular recess 1630*d* of the tubular activation sleeve 1630, and the end of the lower mandrel 1634. A retainer screw 1642 is received within and is threadably coupled to the internally threaded radial opening 1634*b* of the lower mandrel 1634 that also extends into the external radial hole 1602*o* of the upper mandrel 1602.

During operation of the ball gripper assembly 16, in an exemplary embodiment, as illustrated in FIGS. 12A1 to 12A4, the ball gripper assembly may be positioned within the expandable wellbore casing 100 and the internally threaded connection 1602*c* of the upper mandrel 1602 may be coupled to an externally threaded connection 14*a* of an end of the casing cutter assembly 14 and the externally threaded connection 1634*g* of the lower mandrel 1634 may be coupled to an internally threaded connection 18*a* of an end of the tension actuator assembly 18.

In an alternative embodiment, the internally threaded connection 1602*c* of the upper mandrel 1602 may be coupled to an externally threaded connection of an end of the tension actuator assembly 18 and the externally threaded connection 1634*g* of the lower mandrel 1634 may be coupled to an internally threaded connection of an end of casing cutter assembly 14.

In an exemplary embodiment, the deactivation spring 1610 has a greater spring rate than the activation spring 1640. As a result, in an initial operating mode, as illustrated in FIGS.

12A1 to 12A4, a biasing spring force is applied to the deactivation sleeve 1608 and activation sleeve 1630 in a direction 1644 that maintains the activation sleeve in a position relative to the tubular ball race 1628 that maintains the balls 1632 within the radially inward portions of the corresponding tapered annular recesses 1628*a* of the tubular ball race such that the balls do not extend beyond the perimeter of the activation sleeve to engage the expandable wellbore casing 100.

As illustrated in FIGS. 12C1 to 12C4, in an exemplary embodiment, the ball gripper 16 may be operated to engage the interior surface of the expandable wellbore casing 100 by injecting a fluidic material 1650 into the ball gripper assembly through the longitudinal passages 1602*a* and 1634*aa*, of the upper and lower mandrels, 1602 and 1634, respectively.

In particular, when the longitudinal and radial passages, 1602*a* and 1602*b*, respectively, of the upper mandrel 1602 are pressurized by the injection of the fluidic material 1650, the internal annular recess 1608*c* of the deactivation tubular sleeve 1608 is pressurized. When the operating pressure of the fluidic material 1650 within the internal annular recess 1608*c* of the deactivation tubular sleeve 1608 is sufficient to overcome the biasing spring force of the deactivation spring 1610, the deactivation tubular sleeve is displaced in a direction 1652. As a result, the spring force provided by the activation spring 1640 then may displace the activation tubular sleeve 1630 in the direction 1652 thereby moving the balls 1632 on the corresponding tapered annular recesses 1628*a* of the tubular ball race 1628 outwardly in a radial direction into engagement with the interior surface of the expandable wellbore casing 100. In an exemplary embodiment, the operating pressure of the fluidic material 1650 sufficient to overcome the biasing spring force of the deactivation spring 1610 was about 100 psi.

In an exemplary embodiment, when the operating pressure of the fluidic material 1650 is reduced, the operating pressure of the fluidic material 1650 within the internal annular recess 1608*c* of the deactivation tubular sleeve 1608 is no longer sufficient to overcome the biasing spring force of the deactivation spring 1610, and the deactivation tubular sleeve and the activation tubular sleeve 1630 are displaced in a direction opposite to the direction 1652 thereby moving the balls 1632 radially inwardly and out of engagement with the interior surface of the expandable wellbore casing 100.

In an exemplary embodiment, the ball gripper assembly 16 is operated to engage the interior surface of the expandable wellbore casing 100 in combination with the operation of the tension actuator assembly 18 to apply an upward tensile force to one or more elements of the system 10 coupled to and positioned below the tension actuator assembly. As a result, a reaction force comprising a downward tensile force is applied to the lower mandrel 1634 of the ball gripper assembly 16 in a direction opposite to the direction 1652 during the operation of the tension actuator assembly 18. Consequently, due to the geometry of the tapered 1628*a* of the tubular ball race 1628, the balls 1632 are driven up the tapered annular recesses 1628*a* of the tubular ball race 1628 with increased force and the contact force between the balls 1632 and the interior surface of the expandable wellbore casing 100 is significantly increased thereby correspondingly increasing the gripping force and effect of the ball gripper assembly.

In an exemplary embodiment, the ball gripper assembly 16 may be operated to radially expand and plastically deform discrete portions of the expandable wellbore casing 100 by controlling the amount of contact force applied to the interior surface of the expandable wellbore casing by the balls 1632 of the ball gripper assembly. In an experimental test of an exemplary embodiment of the ball gripper assembly 16, an expandable wellbore casing was radially expanded and plastically deformed. This was an unexpected result.

In an exemplary embodiment, the tension actuator assembly 18 operates and is provided substantially, at least in part, as disclosed in one or more of the following: (1) PCT patent application Ser. No. PCT/US02/36267, filed on Nov. 12, 2002, and/or (2) PCT patent application Ser. No. PCT/US03/29859, filed on Sep. 22, 2003, and/or (3) PCT patent application Ser. No. PCT/US03/14153, filed on Nov. 13, 2003, and/or (4) PCT patent application Ser. No. PCT/US03/29460, filed on Sep. 23, 2003, and/or (5) PCT patent application Ser. No. PCT/US04/07711, filed on Mar. 11, 2004, and/or (6) PCT patent application Ser. No. PCT/US04/009434, filed on Mar. 26, 2004, and/or (7) PCT patent application Ser. No. PCT/US04/010317, filed on Apr. 2, 2004, and/or (8) PCT patent application Ser. No. PCT/US04/010712, filed on Apr. 7, 2004, and/or (9) PCT patent application Ser. No. PCT/US04/010762, filed on Apr. 6, 2004, and/or PCT application Ser. No. PCT/US04/011973, filed on Apr. 15, 2004, the disclosures of which are incorporated herein by reference.

In an exemplary embodiment, as illustrated in FIGS. 13A1 to 13A8 and 13B1 to 13B7, the tension actuator assembly 18 includes an upper tubular support member 18002 that defines a longitudinal passage 18002*a*, and external internally threaded radial openings, 18002*b* and 18002*c*, and an external annular recess 18002*d* and includes an internally threaded connection 18002*e* at one end and an external flange 18002*f*, an external annular recess 18002*g* having an externally threaded connection, and an internal annular recess 18002*h* having an internally threaded connection at another end. An end of a tubular actuator barrel 18004 that defines radial passages, 18004*a* and 18004*b*, at one end and radial passages, 18004*c* and 18004*d*, includes an internally threaded connection 18004*e* at one end that mates with, receives, and is threadably coupled to the external annular recess 18002*g* of the upper tubular support member 18002 and abuts and end face of the external flange 18002*f* of the upper tubular support member and an internally threaded connection 18004*f* at another end.

Torsional locking pins, 18006*a* and 18006*b*, are coupled to and mounted within the external radial mounting holes, 18002*b* and 18002*c*, respectively, of the upper tubular support member and received within the radial passages, 18004*a* and 18004*b*, of the end of the tubular actuator barrel 18004. The other end of the tubular actuator barrel 18004 receives and is threadably coupled to an end of a tubular barrel connector 18008 that defines an internal annular recess 18008*a*, external radial mounting holes, 18008*b* and 18008*c*, radial passages, 18008*d* and 18008*e*, and external radial mounting holes, 18008*f* and 18008*g* and includes circumferentially spaced apart teeth 18008*h* at one end. A sealing cartridge 18010 is received within and coupled to the internal annular recess 18008*a* of the tubular barrel connector 18008 for fluidicly sealing the interface between the tubular barrel connector and the sealing cartridge. Torsional locking pins, 18012*a* and 18012*b*, are coupled to and mounted within the external radial mounting holes, 18008*b* and 18008*c*, respectively, of the tubular barrel connector 18008 and received within the radial passages, 18004*c* and 18004*d*, of the tubular actuator barrel 18004.

A tubular member 18014 that defines a longitudinal passage 18014*a* having one or more internal splines 18014*b* at one end and circumferentially spaced apart teeth 18014*c* at another end for engaging the circumferentially spaced apart teeth 18008*h* of the tubular barrel connector 18008 mates with and is received within the actuator barrel 18004 and the one end of the tubular member abuts an end face of the other end of the upper tubular support member 18002 and at another end abuts and end face of the tubular barrel connector 18008. A tubular guide member 18016 that defines a longitudinal passage 18016*a* having a tapered opening 18016*aa*, and radial passages, 18016*b* and 18016*c*, includes an external flange 18016*d* having an externally threaded connection at one end that is received within and coupled to the internal annular recess 18002*h* of the upper tubular support member 18002.

The other end of the tubular barrel connector 18008 is threadably coupled to and is received within an end of a tubular actuator barrel 18018 that defines a longitudinal passage 18018*a*, radial passages, 18018*b* and 18018*c*, and radial passages, 18018*d* and 18018*e*. Torsional locking pins, 18020*a* and 18020*b*, are coupled to and mounted within the external radial mounting holes, 18008*f* and 18008*g*, respectively, of the tubular barrel connector 18008 and received within the radial passages, 18018*b* and 18018*c*, of the tubular actuator barrel 18018. The other end of the tubular actuator barrel 18018 receives and is threadably coupled to an end of a tubular barrel connector 18022 that defines an internal annular recess 18022*a*, external radial mounting holes, 18022*b* and 18022*c*, radial passages, 18022*d* and 18022*e*, and external radial mounting holes, 18022*f* and 18022*g*. A sealing cartridge 18024 is received within and coupled to the internal annular recess 18022*a* of the tubular barrel connector 18022 for fluidicly sealing the interface between the tubular barrel connector and the sealing cartridge. Torsional locking pins, 18024*a* and 18024*b*, are coupled to and mounted within the external radial mounting holes, 18022*b* and 18022*c*, respectively, of the barrel connector 18022 and received within the radial passages, 18018*d* and 18018*e*, of the tubular actuator barrel 18018.

The other end of the tubular barrel connector 18022 is threadably coupled to and is received within an end of a tubular actuator barrel 18026 that defines a longitudinal passage 18026*a*, radial passages, 18026*b* and 18026*c*, and radial passages, 18026*d* and 18026*e*. Torsional locking pins, 18028*a* and 18028*b*, are coupled to and mounted within the external radial mounting holes, 18022*f* and 18022*g*, respectively, of the tubular barrel connector 18022 and received within the radial passages, 18026*b* and 18026*c*, of the tubular actuator barrel 18026. The other end of the tubular actuator barrel 18026 receives and is threadably coupled to an end of a tubular barrel connector 18030 that defines an internal annular recess 18030*a*, external radial mounting holes, 18030*b* and 18030*c*, radial passages, 18030*d* and 18030*e*, and external radial mounting holes, 18030*f* and 18030*g*. A sealing cartridge 18032 is received within and coupled to the internal annular recess 18030*a* of the tubular barrel connector 18030 for fluidicly sealing the interface between the tubular barrel connector and the sealing cartridge. Torsional locking pins, 18034*a* and 18034*b*, are coupled to and mounted within the external radial mounting holes, 18030*b* and 18030*c*, respectively, of the tubular barrel connector 18030 and received within the radial passages, 18026*d* and 18026*e*, of the tubular actuator barrel 18026.

The other end of the tubular barrel connector 18030 is threadably coupled to and is received within an end of a tubular actuator barrel 18036 that defines a longitudinal passage 18036*a*, radial passages, 18036*b* and 18036*c*, and radial passages, 18036*d* and 18036*e*. Torsional locking pins, 18038*a* and 18038*b*, are coupled to and mounted within the external radial mounting holes, 18030*f* and 18030*g*, respectively, of the tubular barrel connector 18030 and received within the radial passages, 18036*b* and 18036*c*, of the tubular actuator barrel 18036. The other end of the tubular actuator barrel 18036 receives and is threadably coupled to an end of a tubular barrel connector 18040 that defines an internal annular recess 18040*a*, external radial mounting holes, 18040*b* and 18040*c*, radial passages, 18040*d* and 18040*e*, and external radial mounting holes, 18040*f* and 18040*g*. A sealing cartridge 18042 is received within and coupled to the internal annular recess 18040*a* of the tubular barrel connector 18040 for fluidicly sealing the interface between the tubular barrel connector and the sealing cartridge. Torsional locking pins, 18044*a* and 18044*b*, are coupled to and mounted within the external radial mounting holes, 18040*b* and 18040*c*, respectively, of the tubular barrel connector 18040 and received within the radial passages, 18036*d* and 18036*e*, of the tubular actuator barrel 18036.

The other end of the tubular barrel connector 18040 is threadably coupled to and is received within an end of a tubular actuator barrel 18046 that defines a longitudinal passage 18046*a*, radial passages, 18046*b* and 18046*c*, and radial passages, 18046*d* and 18046*e*. Torsional locking pins, 18048*a* and 18048*b*, are coupled to and mounted within the external radial mounting holes, 18040*f* and 18040*g*, respectively, of the tubular barrel connector 18040 and received within the radial passages, 18046*b* and 18046*c*, of the tubular actuator barrel 18046. The other end of the tubular actuator barrel 18046 receives and is threadably coupled to an end of a tubular barrel connector 18050 that defines an internal annular recess 18050*a*, external radial mounting holes, 18050*b* and 18050*c*, radial passages, 18050*d* and 18050*e*, and external radial mounting holes, 18050*f* and 18050*g*. A sealing cartridge 18052 is received within and coupled to the internal annular recess 18050*a* of the tubular barrel connector 18050 for fluidicly sealing the interface between the tubular barrel connector and the sealing cartridge. Torsional locking pins, 18054*a* and 18054*b*, are coupled to and mounted within the external radial mounting holes, 18050*b* and 18050*c*, respectively, of the tubular barrel connector 18050 and received within the radial passages, 18046*d* and 18046*e*, of the tubular actuator barrel 18046.

The other end of the tubular barrel connector 18050 is threadably coupled to and is received within an end of a tubular actuator barrel 18056 that defines a longitudinal passage 18056*a*, radial passages, 18056*b* and 18056*c*, and radial passages, 18056*d* and 18056*e*. Torsional locking pins, 18058*a* and 18058*b*, are coupled to and mounted within the external radial mounting holes, 18050*f* and 18050*g*, respectively, of the tubular barrel connector 18050 and received within the radial passages, 18056*b* and 18056*c*, of the tubular actuator barrel 18056. The other end of the tubular actuator barrel 18056 receives and is threadably coupled to an end of a tubular lower stop 18060 that defines an internal annular recess 18060*a*, external radial mounting holes, 18060*b* and 18060*c*, and an internal annular recess 18060*d* that includes one or more circumferentially spaced apart locking teeth 18060*e* at one end and one or more circumferentially spaced apart locking teeth 18060*f* at the other end. A sealing cartridge 18062 is received within and coupled to the internal annular recess 18060*a* of the tubular lower stop 18060 for fluidicly sealing the interface between the tubular lower stop and the sealing cartridge. Torsional locking pins, 18064*a* and 18064*b*, are coupled to and mounted within the external radial mounting holes, 18060*b* and 18060*c*, respectively, of the tubular lower stop 18060 and received within the radial passages, 18056*d* and 18056*e*, of the tubular actuator barrel 18056.

A connector tube 18066 that defines a longitudinal passage 18066*a* and radial mounting holes, 18066*b* and 18066*c*, and includes external splines 18066*d* at one end for engaging the internal splines 18014*b* of the tubular member 18014 and radial mounting holes, 18066*e* and 18066*f*, at another end is received within and sealingly and movably engages the interior surface of the sealing cartridge 18010 mounted within the annular recess 18008*a* of the tubular barrel connector 18008. In this manner, during longitudinal displacement of the connector tube 18066 relative to the tubular barrel connector 18008, a fluidic seal is maintained between the exterior surface of the connector tube and the interior surface of the tubular barrel connector. An end of the connector tube 18066 also receives and mates with the other end of the tubular guide member 18016. Mounting screws, 18068*a* and 18068*b*, are coupled to and received within the radial mounting holes, 18066*b* and 18066*c*, respectively of the connector tube 18066.

The other end of the connector tube 18066 is received within and threadably coupled to an end of a tubular piston 18070 that defines a longitudinal passage 18070*a*, radial mounting holes, 18070*b* and 18070*c*, radial passages, 18070*d* and 18070*e*, and radial mounting holes, 18070*f* and 18070*g*, that includes a flange 18070*h* at one end. A sealing cartridge 18072 is mounted onto and sealingly coupled to the exterior of the tubular piston 18070 proximate the flange 18070*h*. The sealing cartridge 18072 also mates with and sealingly engages the interior surface of the tubular actuator barrel 18018. In this manner, during longitudinal displacement of the tubular piston 18070 relative to the actuator barrel 18018, a fluidic seal is maintained between the exterior surface of the piston and the interior surface of the actuator barrel. Mounting screws, 18074*a* and 18074*b*, are coupled to and mounted within the external radial mounting holes, 18070*b* and 18070*c*, respectively, of the tubular piston 18070 and received within the radial passages, 18066*e* and 18066*f*, of the connector tube 18066.

The other end of the tubular piston 18070 receives and is threadably coupled to an end of a connector tube 18076 that defines a longitudinal passage 18076*a*, radial mounting holes, 18076*b* and 18076*c*, at one end and radial mounting holes, 18076*d* and 18076*e*, at another end. The connector tube 18076 is received within and sealingly and movably engages the interior surface of the sealing cartridge 18024 mounted within the annular recess 18022*a* of the tubular barrel connector 18022. In this manner, during longitudinal displacement of the connector tube 18076 relative to the tubular barrel connector 18022, a fluidic seal is maintained between the exterior surface of the connector tube and the interior surface of the barrel connector. Mounting screws, 18078*a* and 18078*b*, are coupled to and mounted within the external radial mounting holes, 18070*f* and 18070*g*, respectively, of the tubular piston 18070 and received within the radial passages, 18076*b* and 18076*c*, of the connector tube 18076.

The other end of the connector tube 18076 is received within and threadably coupled to an end of a tubular piston 18080 that defines a longitudinal passage 18080*a*, radial mounting holes, 18080*b* and 18080*c*, radial passages, 18080*d* and 18080*e*, and radial mounting holes, 18080*f* and 18080*g*, that includes a flange 18080*h* at one end. A sealing cartridge 18082 is mounted onto and sealingly coupled to the exterior of the tubular piston 18080 proximate the flange 18080*h*. The sealing cartridge 18082 also mates with and sealingly engages the interior surface of the tubular actuator barrel 18026. In this manner, during longitudinal displacement of the tubular piston 18080 relative to the tubular actuator barrel 18026, a fluidic seal is maintained between the exterior surface of the piston and the interior surface of the actuator barrel. Mounting screws, 18084*a* and 18084*b*, are coupled to and mounted within the external radial mounting holes, 18080*b* and 18080*c*, respectively, of the tubular piston 18080 and received within the radial passages, 18076*e* and 18076*f*, of the connector tube 18076.

The other end of the tubular piston 18080 receives and is threadably coupled to an end of a connector tube 18086 that defines a longitudinal passage 18086*a*, radial mounting holes, 18086*b* and 18086*c*, at one end and radial mounting holes, 18086*d* and 18086*e*, at another end. The connector tube 18086 is received within and sealingly and movably engages the interior surface of the sealing cartridge 18032 mounted within the annular recess 18030*a* of the tubular barrel connector 18030. In this manner, during longitudinal displacement of the connector tube 18086 relative to the tubular barrel connector 18030, a fluidic seal is maintained between the exterior surface of the connector tube and the interior surface of the barrel connector. Mounting screws, 18088*a* and 18088*b*, are coupled to and mounted within the external radial mounting holes, 18080*f* and 18080*g*, respectively, of the tubular piston 18080 and received within the radial passages, 18086*b* and 18086*c*, of the connector tube 18086.

The other end of the connector tube 18086 is received within and threadably coupled to an end of a tubular piston 18090 that defines a longitudinal passage 18090*a*, radial mounting holes, 18090*b* and 18090*c*, radial passages, 18090*d* and 18090*e*, and radial mounting holes, 18090*f* and 18090*g*, that includes a flange 18090*h* at one end. A sealing cartridge 18092 is mounted onto and sealingly coupled to the exterior of the tubular piston 18090 proximate the flange 18090*h*. The sealing cartridge 18092 also mates with and sealingly engages the interior surface of the tubular actuator barrel 18036. In this manner, during longitudinal displacement of the tubular piston 18090 relative to the tubular actuator barrel 18036, a fluidic seal is maintained between the exterior surface of the piston and the interior surface of the actuator barrel. Mounting screws, 18094*a* and 18094*b*, are coupled to and mounted within the external radial mounting holes, 18090*b* and 18090*c*, respectively, of the tubular piston 18090 and received within the radial passages, 18086*e* and 18086*f*, of the connector tube 18086.

The other end of the tubular piston 18090 receives and is threadably coupled to an end of a connector tube 18096 that defines a longitudinal passage 18096*a*, radial mounting holes, 18096*b* and 18096*c*, at one end and radial mounting holes, 18096*d* and 18096*e*, at another end. The connector tube 18096 is received within and sealingly and movably engages the interior surface of the sealing cartridge 18042 mounted within the annular recess 18040*a* of the tubular barrel connector 18040. In this manner, during longitudinal displacement of the connector tube 18096 relative to the tubular barrel connector 18040, a fluidic seal is maintained between the exterior surface of the connector tube and the interior surface of the barrel connector. Mounting screws, 18098*a* and 18098*b*, are coupled to and mounted within the external radial mounting holes, 18090*f* and 18090*g*, respectively, of the tubular piston 18090 and received within the radial passages, 18096*b* and 18096*c*, of the connector tube 18096.

The other end of the connector tube 18096 is received within and threadably coupled to an end of a tubular piston 18100 that defines a longitudinal passage 18100*a*, radial mounting holes, 18100*b* and 18100*c*, radial passages, 18100*d* and 18100*e*, and radial mounting holes, 18100*f* and 18100*g*, that includes a flange 18100*h* at one end. A sealing cartridge 18102 is mounted onto and sealingly coupled to the exterior of the tubular piston 18100 proximate the flange 18100*h*. The sealing cartridge 18102 also mates with and sealingly engages the interior surface of the tubular actuator barrel

18046. In this manner, during longitudinal displacement of the tubular piston 18100 relative to the tubular actuator barrel 18046, a fluidic seal is maintained between the exterior surface of the piston and the interior surface of the actuator barrel. Mounting screws, 18104*a* and 18104*b*, are coupled to and mounted within the external radial mounting holes, 18100*b* and 18100*c*, respectively, of the tubular piston 18100 and received within the radial passages, 18096*e* and 18096*f*, of the connector tube 18096.

The other end of the tubular piston 18100 receives and is threadably coupled to an end of a connector tube 18106 that defines a longitudinal passage 18106*a*, radial mounting holes, 18106*b* and 18106*c*, at one end and radial mounting holes, 18106*d* and 18106*e*, at another end. The connector tube 18106 is received within and sealingly and movably engages the interior surface of the sealing cartridge 18052 mounted within the annular recess 18050*a* of the tubular barrel connector 18050. In this manner, during longitudinal displacement of the connector tube 18106 relative to the tubular barrel connector 18050, a fluidic seal is maintained between the exterior surface of the connector tube and the interior surface of the barrel connector. Mounting screws, 18108*a* and 18108*b*, are coupled to and mounted within the external radial mounting holes, 18100*f* and 18100*g*, respectively, of the tubular piston 18100 and received within the radial passages, 18106*b* and 18106*c*, of the connector tube 18106.

The other end of the connector tube 18106 is received within and threadably coupled to an end of a tubular piston 18110 that defines a longitudinal passage 18110*a*, radial mounting holes, 18110*b* and 18110*c*, radial passages, 18110*d* and 18110*e*, radial mounting holes, 18110*f* and 18110*g*, that includes a flange 18110*h* at one end and circumferentially spaced teeth 18110*i* at another end for engaging the one or more circumferentially spaced apart locking teeth 18060*e* of the tubular lower stop 18060. A sealing cartridge 18112 is mounted onto and sealingly coupled to the exterior of the tubular piston 18110 proximate the flange 18110*h*. The sealing cartridge 18112 also mates with and sealingly engages the interior surface of the actuator barrel 18056. In this manner, during longitudinal displacement of the tubular piston 18110 relative to the actuator barrel 18056, a fluidic seal is maintained between the exterior surface of the piston and the interior surface of the actuator barrel. Mounting screws, 18114*a* and 18114*b*, are coupled to and mounted within the external radial mounting holes, 18110*b* and 18110*c*, respectively, of the tubular piston 18110 and received within the radial passages, 18106*d* and 18106*e*, of the connector tube 18106.

The other end of the tubular piston 18110 receives and is threadably coupled to an end of a connector tube 18116 that defines a longitudinal passage 18116*a*, radial mounting holes, 18116*b* and 18116*c*, at one end and radial mounting holes, 18116*d* and 18116*e*, at another end that includes an external flange 18116*f* that includes circumferentially spaced apart teeth 18116*g* that extend from an end face of the external flange for engaging the teeth 18060*f* of the tubular lower stop 18060, and an externally threaded connection 18116*h* at another end. The connector tube 18116 is received within and sealingly and movably engages the interior surface of the sealing cartridge 18062 mounted within the annular recess 18060*a* of the lower tubular stop 18060. In this manner, during longitudinal displacement of the connector tube 18116 relative to the lower tubular stop 18060, a fluidic seal is maintained between the exterior surface of the connector tube and the interior surface of the lower tubular stop. Mounting screws, 18118*a* and 18118*b*, are coupled to and mounted within the external radial mounting holes, 18110*f* and 18110*g*, respectively, of the tubular piston 18110 and received within the radial passages, 18116*b* and 18116*c*, of the connector tube 18116.

In an exemplary embodiment, as illustrated in FIGS. 13A1 to 13A8, the internally threaded connection 18002*e* of the upper tubular support member 18002 receives and is coupled to the externally threaded connection 1234*g* of the lower mandrel 1234 of the ball grabber assembly 16 and the externally threaded connection 18116*h* of the connector tube 18116 is received within and is coupled to an internally threaded connection 20*a* of an end of the safety sub assembly 20.

In an exemplary embodiment, as illustrated in FIGS. 13A1 to 13A8, during operation of the tension actuator assembly 18, the tension actuator assembly is positioned within the expandable wellbore casing 100 and fluidic material 18200 is injected into the tension actuator assembly through the passages 18002*a*, 18016*a*, 18066*a*, 18070*a*, 18076*a*, 18080*a*, 18086*a*, 18090*a*, 18096*a*, 18100*a*, 18106*a*, 18110*a*, and 18116*a*. The injected fluidic material 18200 will also pass through the radial passages, 18070*d* and 18070*e*, 18080*d* and 18080*e*, 18090*d* and 18090*e*, 18100*d* and 18100*e*, 18110*d* and 18110*e*, of the tubular pistons, 18070, 18080, 18090, 18100, and 18110, respectively, into annular piston chambers, 18202, 18204, 18206, 18208, 18208, and 18210.

As illustrated in FIGS. 13B1 to 13B7, the operating pressure of the fluidic material 18200 may then be increased by, for example, controllably blocking or limiting the flow of the fluidic material through the passage 18116*a* and/or increasing the operating pressure of the outlet of a pumping device for injecting the fluidic material 18200 into the tension actuator assembly 18. As a result, of the increased operating pressure of the fluidic material 18200 within the tension actuator assembly 18, the operating pressures of the annular piston chambers, 18202, 18204, 18206, 18208, 18208, and 18210, will be increased sufficiently to displace the tubular pistons, 18070, 18080, 18090, 18100, and 18110, upwardly in the direction 18212 thereby also displacing the connector tube 18116. As a result, a upward tensile force is applied to all elements of the system 10 coupled to and positioned below the connector tube 18116. In an exemplary embodiment, during the upward displacement of the tubular pistons, 18070, 18080, 18090, 18100, and 18110, fluidic materials displaced by the tubular pistons within discharge annular chambers, 18214, 18216, 18218, 18220, and 18222 are exhausted out of the tension actuator assembly 18 through the radial passages, 18008*d* and 18008*e*, 18022*d* and 18022*e*, 18030*d* and 18030*e*, 18040*d* and 18040*e*, 18050*d* and 18050*e*, respectively. Furthermore, in an exemplary embodiment, the upward displacement of the tubular pistons, 18070, 18080, 18090, 18100, and 18110, further causes the external splines 18066*d* of the connector tube 18066 to engage the internal splines 18014*b* of the tubular member 18014 and the circumferentially spaced apart teeth 18116*g* of the connector tube 18116 to engage the circumferentially spaced teeth 18060*f* of the tubular lower stop 18060. As a result of the interaction of the external splines 18066*d* of the connector tube 18066 to engage the internal splines 18014*b* of the tubular member 18014 and the circumferentially spaced apart teeth 18116*g* of the connector tube 18116 to engage the circumferentially spaced teeth 18060*f* of the tubular lower stop 18060, torsional loads may be transmitted through the tension actuator assembly 18.

Figure 14A:
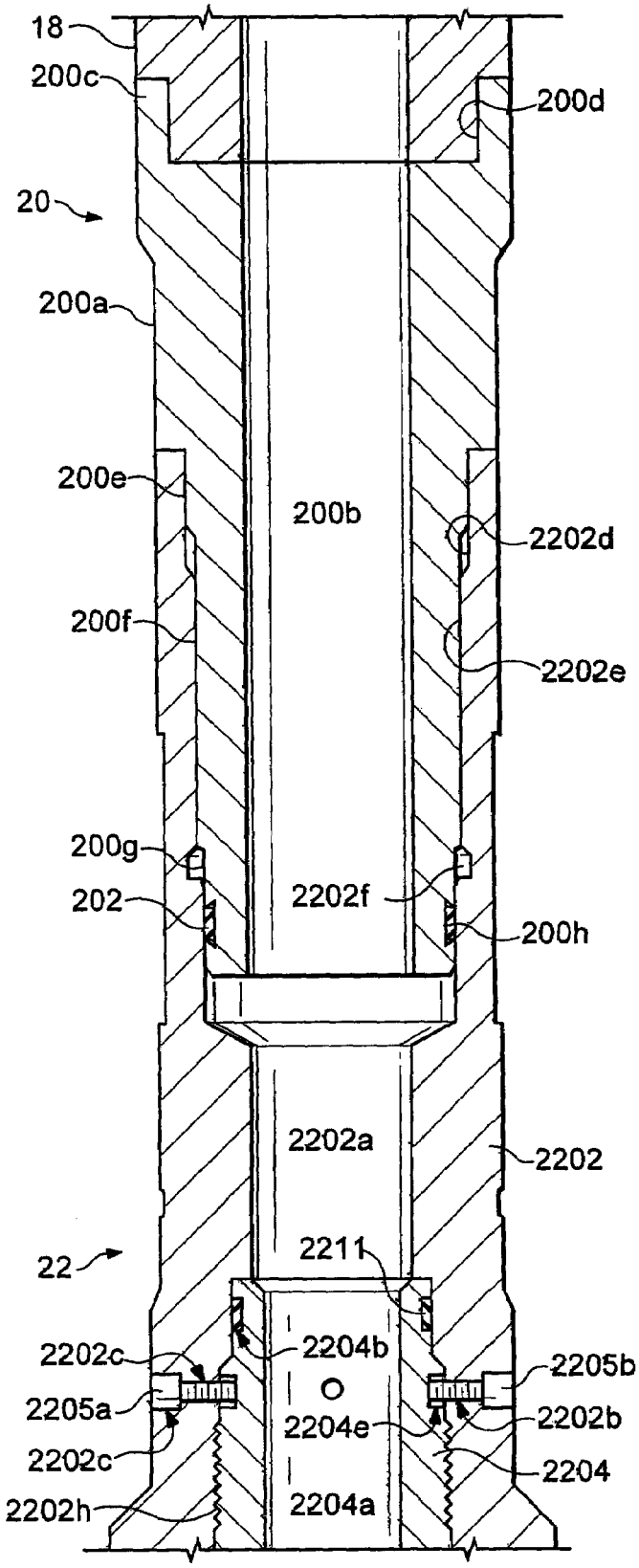
FIG. 14A is a fragmentary cross-sectional illustrations of an exemplary embodiment of a safety sub assembly.

In an exemplary embodiment, as illustrated in FIG. 14A, the safety sub assembly 20 includes a tubular body 200*a* that defines a longitudinal passage 200*b* and includes an external flange 200*c* and an internal annular recess 200*d* at one end, and external annular recesses, 200*e*, 200*f*, 200*g*, and 200*h* at another end. A sealing member 202 is positioned within the external annular recess 200*h* at the other end of the tubular body 200*a*.

Figure 14B:
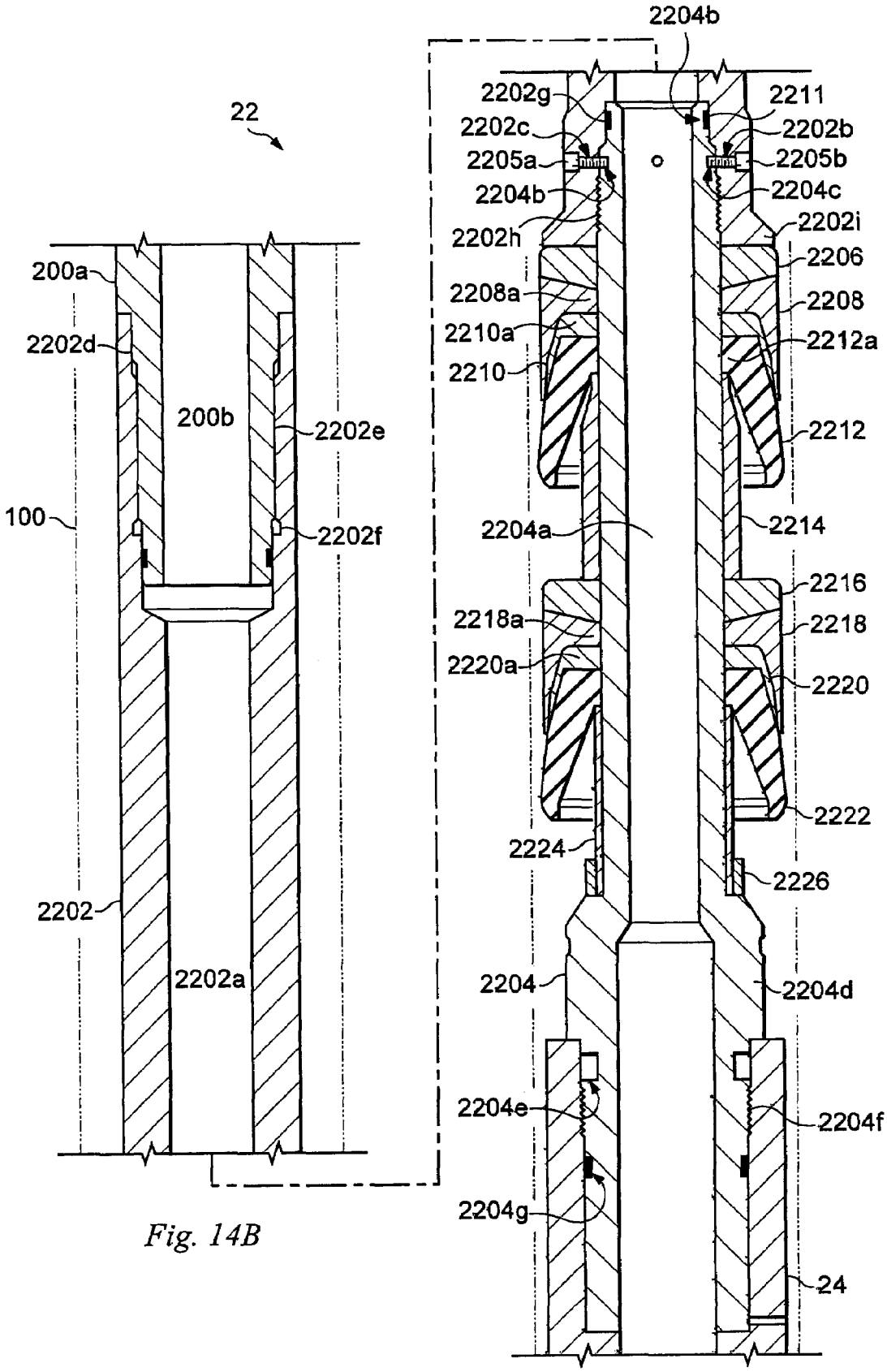
Figure 14C:
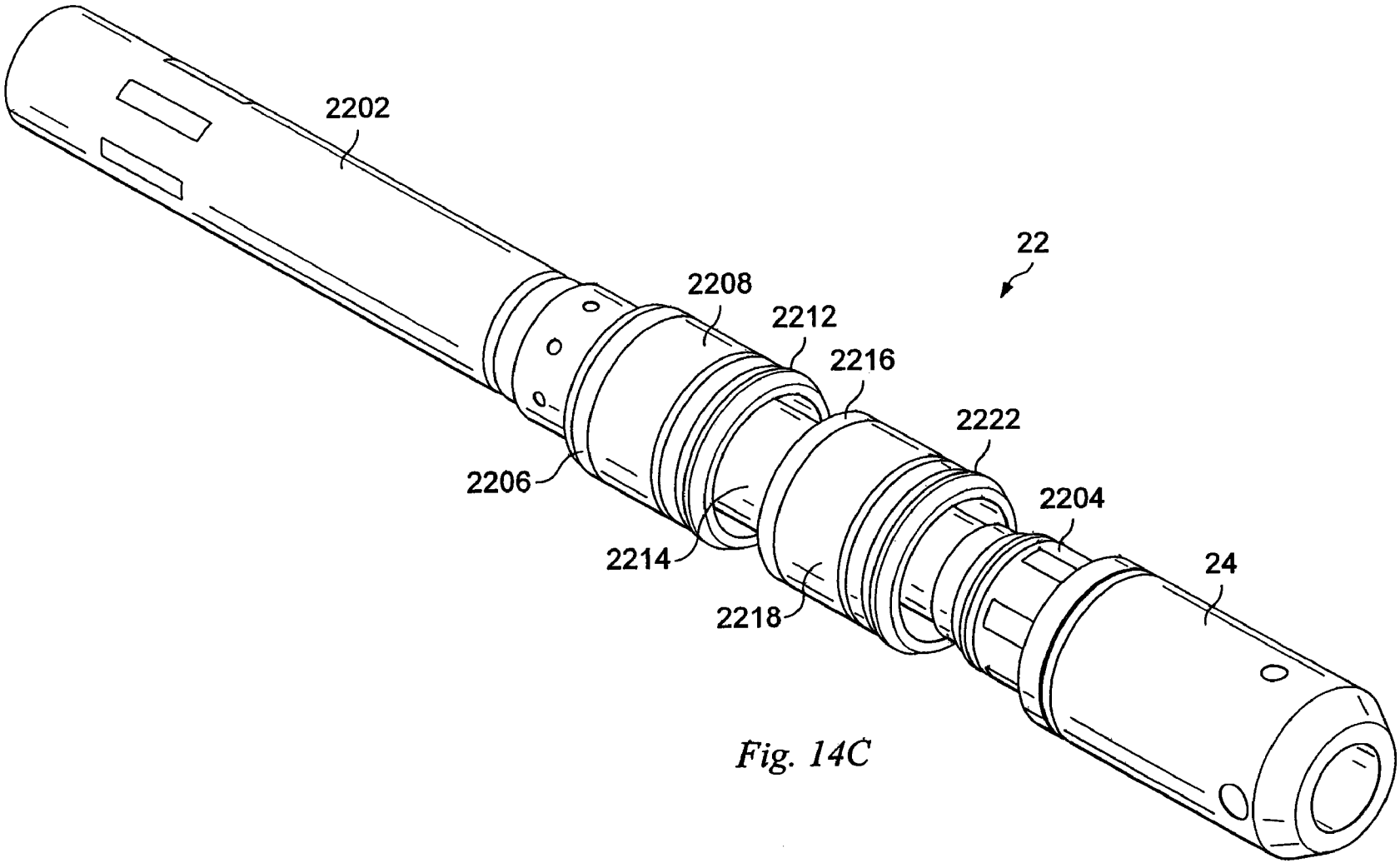
Figures 1, 15:
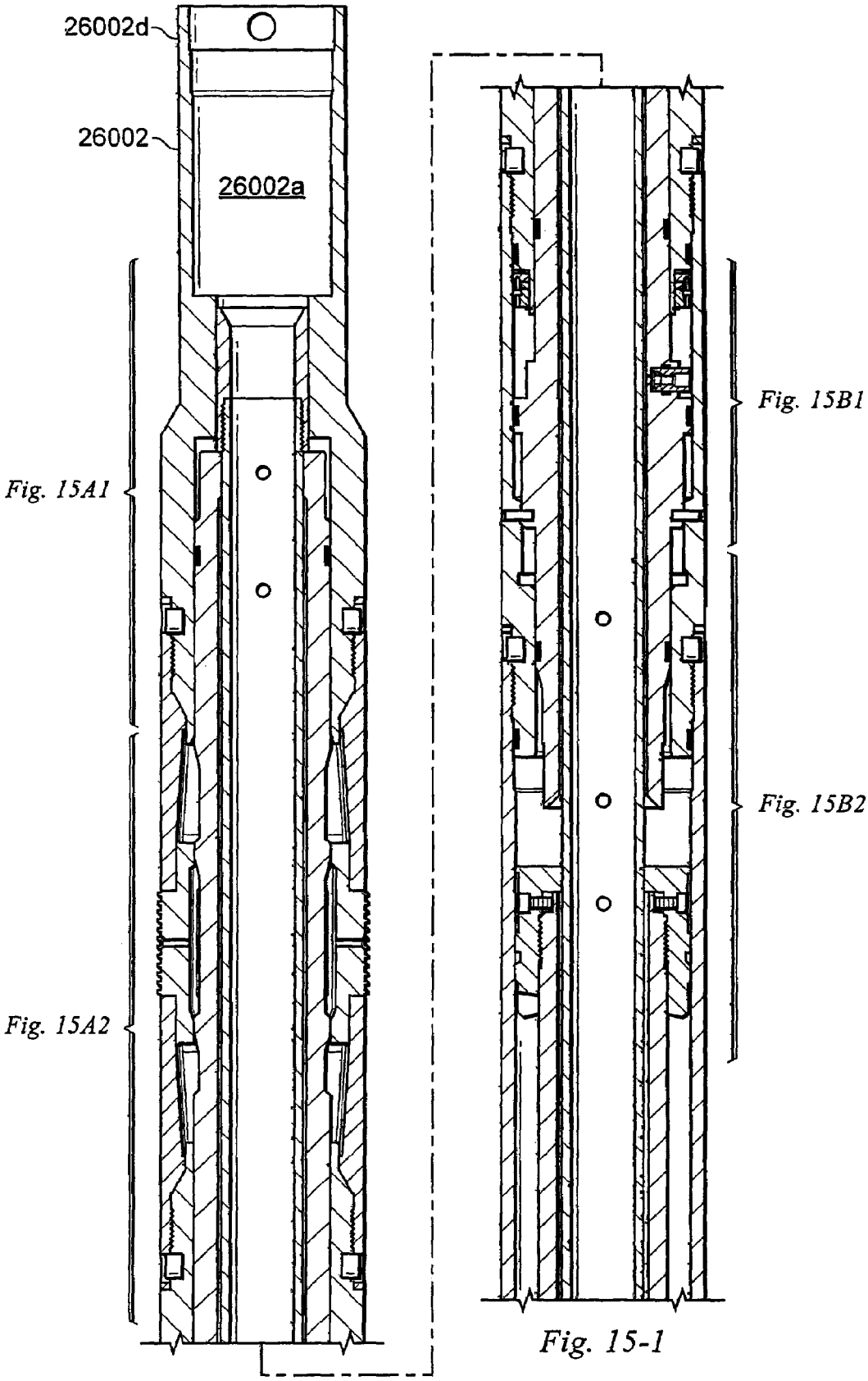
Figures 2, 15:
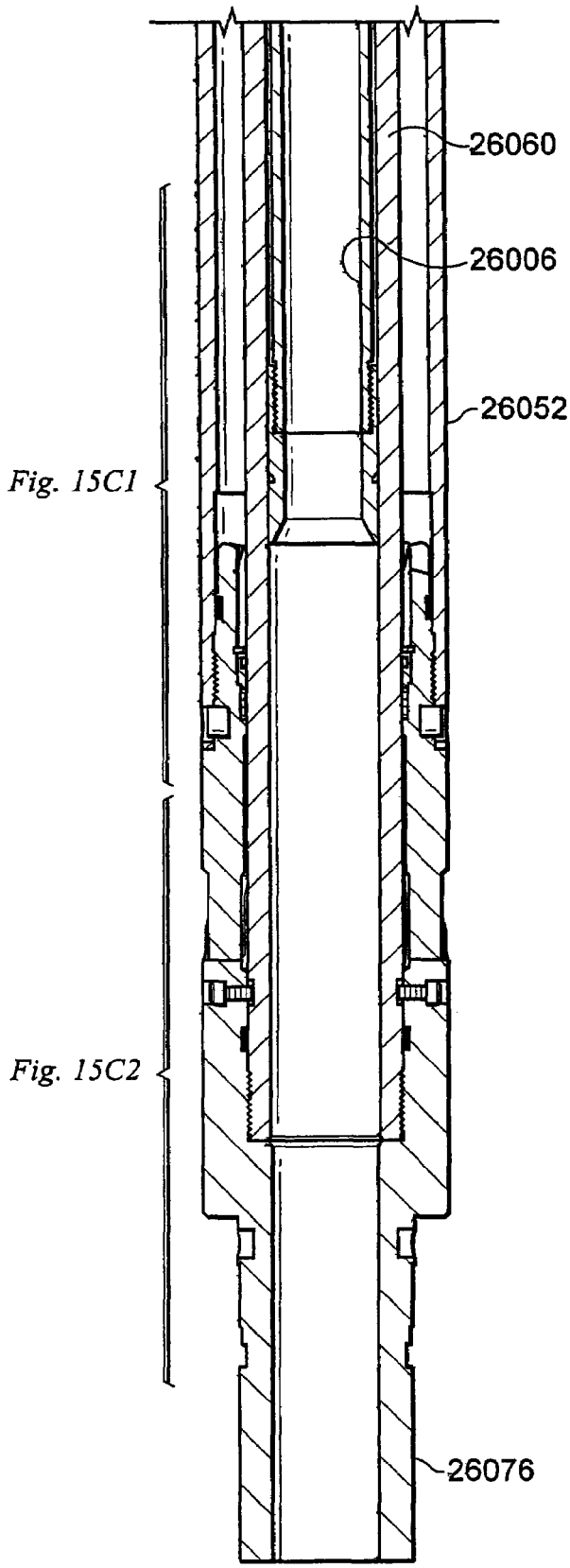
Figure 15D:
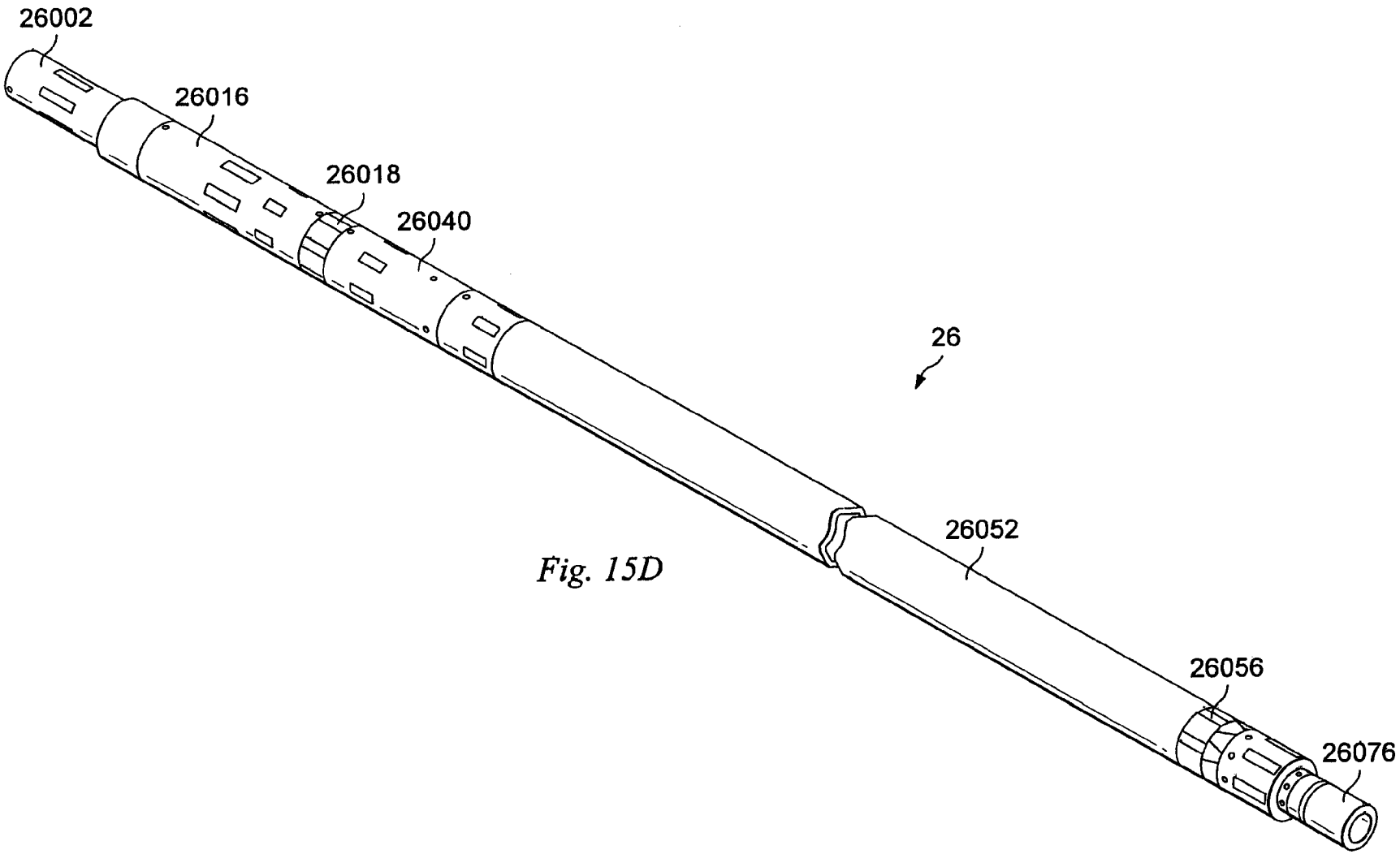

In an exemplary embodiment, as illustrated in FIGS. 14A, 14B and 14C, the sealing cup assembly 22 includes an upper tubular mandrel 2202 that defines a longitudinal passage 2202*a* and internally threaded radial mounting holes, 2202*b* and 2202*c*, and includes an internal annular recess 2202*d* at one end, an internal annular recess 2202*e*, an internal annular recess 2202*f*, an internal annular recess 2202*g*, and an internally threaded internal annular recess 2202*h* and an external flange 2202*i* at another end. The internal annular recesses, 2202*d*, 2202*e*, and 2202*f*, of the upper tubular mandrel 2202 of the sealing cup assembly 22 receive, mate with, and are coupled to the other end of the tubular body 200*a* of the safety sub assembly 20.

An externally threaded end of a lower tubular mandrel 2204 that defines a longitudinal passage 2204*a* and includes an external annular recess 2204*b* at one end, an external annular recess 2204*c*, an external flange 2204*d*, an external annular recess 2204*e*, an externally threaded external flange 2204*f*, and an external annular recess 2204*g* at another end mates with, is received within, and is coupled to the internal annular recesses, 2202*g* and 2202*h*, of the other end of the upper tubular mandrel 2202.

Mounting screws, 2250*a* and 2205*b*, are received within and coupled to the mounting holes, 2202*c* and 2202*b*, respectively, of the tubular mandrel 2202 that extend into and engage the external annular recess 2204*c* of the lower tubular mandrel 2204.

A tubular cup seal spacer 2206 receives and is mounted upon the lower tubular mandrel 2204 proximate the external flange 2202*i* of the upper tubular mandrel 2202. A tubular cup seal retainer 2208 that includes an internal flange 2208*a* at one end receives and is mounted upon the lower tubular mandrel 2204 proximate the tubular cup seal spacer 2206. A tubular cup seal retainer 2210 that includes an internal flange 2210*a* at one end receives and is mounted upon the lower tubular mandrel 2204 proximate the other end of the tubular cup seal retainer 2208. In an exemplary embodiment, the tubular cup seal retainer 2210 is nested within the other end of the tubular cup seal retainer 2208. A tubular cup seal 2212 that includes an internal flange 2212*a* at one end receives and is mounted upon the lower tubular mandrel 2204 proximate the other end of the tubular cup seal retainer 2210. In an exemplary embodiment, the tubular cup seal 2212 is nested within the other end of the tubular cup seal retainer 2210.

A sealing member 2211 is received within the external annular recess 2204*b* of the lower tubular mandrel 2204 for sealing the interface between the lower tubular mandrel and the upper tubular mandrel 2202.

A tubular spacer 2214 receives and is mounted upon the lower tubular mandrel 2204 proximate the other end of the tubular cup seal 2212.

A tubular cup seal spacer 2216 receives and is mounted upon the lower tubular mandrel 2204 proximate the other end of the tubular spacer 2214. A tubular cup seal retainer 2218 that includes an internal flange 2218*a* at one end receives and is mounted upon the lower tubular mandrel 2204 proximate the other end of the tubular cup seal spacer 2216. A tubular cup seal retainer 2220 that includes an internal flange 2220*a* at one end receives and is mounted upon the lower tubular mandrel 2204 proximate the other end of the tubular cup seal retainer 2218. In an exemplary embodiment, the tubular cup seal retainer 2220 is nested within the other end of the tubular cup seal retainer 2218. A tubular cup seal 2222 that includes an internal flange 2222*a* at one end receives and is mounted upon the lower tubular mandrel 2204 proximate the other end of the tubular cup seal retainer 2220. In an exemplary embodiment, the tubular cup seal 2222 is nested within the other end of the tubular cup seal retainer 2220.

A tubular spacer 2224 receives and is mounted upon the lower tubular mandrel 2204 proximate the other end of the tubular cup seal 2222 at one end and proximate the external flange 2204*d* of the lower tubular mandrel at another end. A retaining ring 2226 receives and is mounted upon the other end of the tubular spacer 2224 proximate the external flange 2204*d* of the lower tubular mandrel 2204.

In an exemplary embodiment, during operation of the system 10, the end of the tubular body 200*a* of the safety sub assembly 20 is coupled to and receives and is coupled to an end of the tension actuator assembly 18 and the other end of the lower tubular mandrel 2204 of the sealing cup assembly 22 is received within and is coupled to an end of the casing lock assembly 24.

In an exemplary embodiment, during operation of the system 10, the tubular cup seals, 2212 and/or 2222, sealingly engage the interior surface of the expandable tubular member 100. In this manner, when an annulus defined between the system 10 and the expandable wellbore casing 10, below the tubular cup seals, 2212 and/or 2222, is pressurized, the resulting pressure differential across the tubular cup seals applies an upward tensile force to the system thereby pulling the adjustable bell section expansion cone assembly 28 and/or the adjustable casing expansion cone assembly 30 through the expandable wellbore casing. In this manner, the adjustable bell section expansion cone assembly 28 and/or the adjustable casing expansion cone assembly 30, if either or both are adjusted to an outside diameter suitable for a radial expansion operation, may radially expand and plastically deform the expandable wellbore casing 100.

In an exemplary embodiment, the sealing cup assembly 22 operates and is provided substantially, at least in part, as disclosed in one or more of the following: (1) PCT patent application Ser. No. PCT/US02/36157, filed on Nov. 12, 2002, and/or (2) PCT patent application Ser. No. PCT/US02/36267, filed on Nov. 12, 2002, and/or (3) PCT patent application Ser. No. PCT/US03/04837, filed on Feb. 29, 2003, and/or (4) PCT patent application Ser. No. PCT/US03/29859, filed on Sep. 22, 2003, and/or (5) PCT patent application Ser. No. PCT/US03/14153, filed on Nov. 13, 2003, and/or (6) PCT patent application Ser. No. PCT/US03/18530, filed on Jun. 11, 2003, and/or (7) PCT patent application Ser. No. PCT/US04/07711, filed on Mar. 11, 2004, and/or (8) PCT patent application Ser. No. PCT/US04/009434, filed on Mar. 26, 2004, and/or (9) PCT patent application Ser. No. PCT/US04/010317, filed on Apr. 2, 2004, and/or (10) PCT patent application Ser. No. PCT/US04/010712, filed on Apr. 7, 2004, and/or (11) PCT patent application Ser. No. PCT/US04/010762, filed on Apr. 6, 2004, and/or PCT application Ser. No. PCT/US04/011973, filed on Apr. 15, 2004, the disclosures of which are incorporated herein by reference.

In an exemplary embodiment, the casing lock assembly 24 operates and is provided substantially, at least in part, as disclosed in one or more of the following: (1) PCT patent application Ser. No. PCT/US02/36267, filed on Nov. 12, 2002, and/or (2) PCT patent application Ser. No. PCT/US03/29859, filed on Sep. 22, 2003, and/or (3) PCT patent application Ser. No. PCT/US03/14153, filed on Nov. 13, 2003, and/or (4) PCT patent application Ser. No. PCT/US04/07711, filed on Mar. 11, 2004, and/or (5) PCT patent application Ser. No. PCT/US04/009434, filed on Mar. 26, 2004, and/or (6) PCT patent application Ser. No. PCT/US04/010317, filed on Apr. 2, 2004, and/or (7) PCT patent application Ser. No. PCT/US04/010712, filed on Apr. 7, 2004, and/or (8) PCT patent application Ser. No. PCT/US04/010762, filed on Apr. 6, 2004, and/or PCT application Ser. No. PCT/US04/011973, filed on Apr. 15, 2004, the disclosures of which are incorporated herein by reference.

In an exemplary embodiment, the extension actuator assembly 26 operates and is provided substantially, at least in part, as disclosed in one or more of the following: (1) PCT patent application Ser. No. PCT/US02/36267, filed on Nov. 12, 2002, and/or (2) PCT patent application Ser. No. PCT/US03/29859, filed on Sep. 22, 2003, and/or (3) PCT patent application Ser. No. PCT/US03/13787, filed on May 5, 2003, and/or (4) PCT patent application Ser. No. PCT/US03/29460, filed on Sep. 22, 2003, and/or (5) PCT patent application Ser. No. PCT/US04/07711, filed on Mar. 11, 2004, and/or (6) PCT patent application Ser. No. PCT/US04/009434, filed on Mar. 26, 2004, and/or (7) PCT patent application Ser. No. PCT/US04/010317, filed on Apr. 2, 2004, and/or (8) PCT patent application Ser. No. PCT/US04/010712, filed on Apr. 7, 2003, and/or (9) PCT patent application Ser. No. PCT/US04/010762, filed on Apr. 6, 2003, and/or PCT application Ser. No. PCT/US04/011973, filed on Apr. 15, 2004, the disclosures of which are incorporated herein by reference.

In an exemplary embodiment, as illustrated in FIGS. 15-1, 15-2, 15A1, 15A2, 15B1, 15B2, 15C1, 15C2, 15D, 15E1 to 15E5, 15F1 to 15F5, and 15G1 to 15G5, the extension actuator assembly 26, combines the functionality of the casing lock assembly 24 with the functionality of the extension actuator assembly, and includes a tubular upper tool joint 26002 that defines a longitudinal passage 26002*a* and mounting holes, 26002*b* and 26002*c*, and includes an internal threaded connection 26002*d* at one end, an external flange 26002*e*, an external recess 26002*f* having an external threaded connection, a tapered recess 26002*g*, and an external recess 26002*h* and an internal recess 26002*i* at another end. An end of an upper pull-nut tube 26004 that defines a longitudinal passage 26004*a* and includes an external recess 26004*b* and an internally threaded internal recess 26004*c* at another end is received within and mates with the longitudinal passage 26002*a* of the tubular upper tool joint 26002.

An externally threaded end of a tubular inner mandrel 26006 that defines a longitudinal passage 26006*a* and radial passages, 26006*b*, 26006*c*, 26006*d*, and 26006*e*, and includes an externally threaded connection 26006*f* at another end mates with, is received within, and is coupled to the internally threaded recess 26004*c* of the upper pull-nut tube 26004. An internally threaded end of an lower pull-nut tube 26008 that defines a longitudinal passage 26008*a* and includes an external recess 26008*b* receives, mates with, and is coupled to externally threaded connection 26006*f* of the tubular inner mandrel 26006.

An internal flange 26010*a* of an end of a tubular lock mandrel 26010 that defines a longitudinal passage 26010*b*, radial passages, 26010*c* and 26010*d*, a radial passage 26010*e*, and a radial passage 26010*f* having an internal annular recess 26016*f* a and includes an external flange 26010*g* that mates with and is received within the internal recess 26002*i* of the tubular upper tool joint 26002, an external annular recess 26010*h*, an external flange 26010*i*, an external flange 26010*j*, an external flange 26010*k*, an external flange 26010*l*, an external flange 26010*m* that includes an external annular recess 26010*ma*, an external flange 26010*n* that defines mounting holes, 26010*o* and 26010*p*, an external annular recess 26010*q*, an external annular recess 26010*r*, and a tapered annular recess 26010*s* at another end receives and mates with the tubular inner mandrel 26006. Internal flanges, 26012*a* and 26012*b*, of a first locking dog 26012 that defines a radial passage 26012*c* and includes spring arms, 26012*d* and 26012*e*, and an external flange 26012*f* including external teeth 26012*g* are positioned upon the external flanges, 26010*i* and 26010*j*, of the tubular lock mandrel 26010. Internal flanges, 26014*a* and 26014*b*, of a second locking dog 26014 that defines a radial passage 26014*c* and includes spring arms, 26014*d* and 26014*e*, and an external flange 26014*f* including external teeth 26014*g* are positioned upon the external flanges, 26010*i* and 26010*j*, of the tubular lock mandrel 26010.

An internally threaded end of a tubular retainer sleeve 26016 that defines a longitudinal passage 26016*a*, radial passages, 26016*b* and 26016*c*, at one end, radial passages, 26016*d* and 26016*e*, for receiving and mating with the external flanges, 26012*f* and 26014*f*, respectively, of the first and second locking dogs, 26012 and 26014, respectively, and radial passages, 26016*f* and 26016*g*, at another end and includes a tapered internal flange 26016*h*, a tapered internal recess 26016*i* that receives and mates with the spring arms, 26012*d* and 26014*d*, and ends of the first and second locking dogs, respectively, a tapered internal recess 26016*j* that receives and mates with the springs arms, 26012*e* and 26014*e*, and other ends of the first and second locking dogs, respectively, a tapered internal flange 26016*k*, and an internal threaded connection 260161 at another end receives, mates with, and is coupled to the externally threaded connection 26002*f* of the end of the tubular upper tool joint 26002. The ends of the spring arms, 26012*d* and 26014*d*, of the first and second locking dogs, 26012 and 26014, respectively, are held between the internal surface of the end of the tapered internal recess 26016*i* of the tubular retainer sleeve 26016 and the external surface of the end of the tapered external annular recess 26002*h* of the tubular upper tool joint 26002.

An externally threaded connection 26018*a* of an end of a tubular connector 26018 that defines mounting holes, 26018*a* and 26018*b*, and mounting holes, 26018*c* and 26018*d*, and includes a tapered external annular recess 26018*e* at one end, an external annular recess 26018*f* and an external annular recess 26018*g* at another end is received within, mates with, and is coupled to the internal threaded connection 260161 of the end of the tubular retainer sleeve 26016. The ends of the spring arms, 26012*e* and 26014*e*, of the first and second locking dogs, 26012 and 26014, respectively, are held between the internal surface of the end of the tapered internal recess 26016*j* of the tubular retainer sleeve 26016 and the external surface of the end of the tapered external annular recess 26018*e* of the tubular connector 26018.

A sealing member 26020 is received within the external annular recess 26010*h* of the tubular lock mandrel 26010 for sealing the interface between the tubular lock mandrel and the tubular upper tool joint 26002. A sealing member 26022 is received within the external annular recess 26010*q* of the tubular lock mandrel 26010 for sealing the interface between the tubular lock mandrel and the tubular connector 26018.

A tubular face seal 26024, tubular face seal back-up 26026, a spring 26028, and a plunger 26030 are mounted upon and retained upon the external annular recess 26018*g* of the tubular connector 26018 by a snap ring 26032 that is coupled to the external annular recess of the tubular connector. A burst disk 26034 and tubular burst disk bushing 26036 are mounted within the radial passage 26010*f* of the tubular lock mandrel 26010, and a sealing member 26038 is received within the internal annular recess 26010*f* a of the radial passage of the tubular lock mandrel for sealing the interface between the tubular burst disk bushing and the tubular lock mandrel.

An internally threaded end 26040*a* of a tubular release body 26040 that defines a longitudinal passage 26040*b*, radial passages, 26040*c* and 26040*d*, radial mounting holes, 26040*e* and 26040*f*, radial mounting holes, 26040*g* and 26040*h*, and includes an internal flange 26040*i* that mates with and receives the external flange 26010*n* of the tubular lock mandrel 26010, an internal flange 26040*j* that mates with and receives the tubular lock mandrel receives, and an external annular recess 26040*k* mates with, and is coupled to an externally threaded end 26018*h* of the tubular connector 26018. A sealing member 26042 received within the external annular recess 26018*f* of the tubular connector 26018 seals the interface between the tubular connector and the tubular release body 26040. A sealing member 26044 received within the external annular recess 26010*ma* of the tubular lock mandrel 26010 seals the interface between the tubular lock mandrel and the tubular release body 26040. Shear pins, 26046*a* and 26046*b*, are received within and coupled to the radial mounting holes, 26010*o* and 26040*e*, and 26010*p* and 26040*f*, respectively, of the tubular lock mandrel 26010 and tubular release body 26040, respectively. Torque pins, 26048*a* and 26048*b*, are received within and coupled to the radial mounting holes, 26018*c* and 26018*d*, respectively, of the tubular connector 26018 that also extend into the radial passages, 26040*c* and 26040*d*, respectively, of the tubular release body 26040. A sealing member 26050 received within the external annular recess 26010*r* of the tubular lock mandrel 26010 seals the interface between the tubular lock mandrel and the internal flange 26040*j* of the tubular release body 26040.

An internally threaded end 26052*a* of a tubular extender barrel 26052 that defines a longitudinal passage 26052*b*, radial passages, 26052*c* and 26052*d*, and radial passages, 26052*e* and 26052*f*, and includes receives, mates with, and is coupled to an external threaded connection 260401 of the tubular release body 26040. A sealing member 26054 received within the external annular recess 26040*k* of the tubular release body 26040 seals the interface between the tubular release body and the tubular extender barrel 26052.

An external threaded connection 26056*a* of an end of a tubular lower bushing 26056 that defines a longitudinal passage 26056*b* and mounting holes, 26056*c* and 26056*d*, and includes an internal annular recess 26056*e*, an internal annular recess 26056*f*, a plurality of circumferentially spaced apart teeth 26056*g* at one end, a plurality of circumferentially spaced apart teeth 26056*h* at another end, and an external annular recess 26056*i* is received within, mates with, and is coupled to an internal threaded connection 26052*m* of the tubular extender barrel 26052. Torque pins, 26058*a* and 26058*b*, are mounted within and coupled to the mounting holes, 26056*c* and 26056*d*, respectively, of the tubular lower bushing 26056 that also extend into the radial passages, 26052*e* and 26052*f*, respectively, of the tubular extender barrel 26052.

A tubular connecting rod 26060 that defines a longitudinal passage 26060*a* that receives and mates with the lower pull-nut tube 26008, radial passages, 26060*b* and 26060*c*, and radial mounting holes, 26060*d* and 26060*e*, and includes an external threaded connection 26060*f* at one end, and an external threaded connection 26060*g* at another end is slidably received within the longitudinal passage 25056*b* of the tubular lower bushing 26056. An internal threaded connection 26062*a* of an inner mandrel tubular piston 26062 that defines mounting holes, 26062*b* and 26062*c*, and includes an internal flange 26062*d* at one end that receives and mates with the tubular inner mandrel 26006, an external annular recess 26062*e*, and a plurality of circumferentially spaced apart teeth 26062*f* at another end receives, mates with, and is coupled to the external threaded connection 26060*f* of the tubular connecting rod 26060.

Torque screws, 26064*a* and 26064*b*, are mounted within and coupled to the mounting holes, 26062*b* and 26062*c*, respectively, of the inner mandrel tubular piston 26062 that also extend into the radial passages, 26060*b* and 26060*c*, of the tubular connecting rod 26060. A sealing member 26066 positioned within the external annular recess 26062*e* of the inner mandrel tubular piston 26062 seals the interface between the inner tubular piston and the tubular extender barrel 26052. A sealing member 26068 positioned within the external annular recess 26056*i* of the tubular lower bushing 26056 seals the interface between the tubular lower bushing and the tubular extender barrel 26052.

A packing sealing element 26070 is received within the internal annular recess 25056*f* of the tubular lower bushing 26056, and a packing retainer 26072 is received within the internal annular recess 26056*e* of the tubular lower bushing for sealing the interface between the tubular lower bushing and the tubular connecting rod 26060. The packing sealing element 26070 and the packing retainer 26072 are retained within the internal annular recess 25056*f* of the tubular lower bushing 26056 and internal annular recess 26056*e* of the tubular lower bushing, respectively, by a snap ring 26074 that is coupled to the tubular connecting rod 26060.

An internally threaded connection 26076*a* of a tubular lower tool joint 26076 that defines a longitudinal passage 26076*b*, radial mounting holes, 26076*c* and 26076*d*, and radial mounting holes, 26076*e* and 26076*f*, and includes an internal annular recess 26076*g* and an external annular recess 26076*h* receives, mates with, and is coupled to an external threaded connection 26060*g* of the tubular connecting rod 26060. Torque screws, 26078*a* and 26078*b*, are mounted within and coupled to the mounting holes, 26076*c* and 26076*d*, respectively, of the tubular lower tool joint 26076 that also extend into the radial passages, 26060*d* and 26060*e*, of the tubular connecting rod 26060. A sealing member 26080 is received within the internal annular recess 26076*g* of the tubular lower tool joint 26076 for sealing the interface between the tubular lower tool joint and the tubular connecting rod 26060.

In an exemplary embodiment, during operation of the extension actuator assembly 26, as illustrated in FIGS. 15E1 to 15E5, the extension actuator assembly is positioned within the wellbore 102, the internal threaded connection 26002*d* of the tubular upper tool joint 26002 receives, mates with, and is coupled to an end of the sealing cup assembly 22, and the end of the tubular lower tool joint 26076 is received within, mates with, and is coupled to an end of the adjustable bell section expansion cone assembly 28. In an exemplary embodiment, a portion 100*a* of the expandable wellbore casing 100 includes internal teeth 100*b* that engage with, and are coupled to, the external teeth, 26012*g* and 26014*g*, of the first and second locking dogs, 26012 and 26014, respectively. In this manner, the expandable wellbore casing 100 is locked to the extension actuator assembly 26 of the system 10.

In an exemplary embodiment, during the operation of the extension actuator assembly 26, a fluidic material 26100 may then be injected into the extension actuator assembly through the longitudinal passages 26004*a*, 26006*a*, and 26008*a* of the upper pull-nut tube 26004, tubular inner mandrel 26006, and lower pull-nut tube 26008, respectively, thereby pressurizing the longitudinal passages of the upper pull-nut tube, tubular inner mandrel, and lower pull-nut tube. As a result, the fluidic material 26100 is also conveyed through the radial passage 26006*c* of the tubular inner mandrel 26006 into and through an annulus 26102 defined between the tubular inner mandrel and the tubular lock mandrel 26010. The fluidic material 26100 is then conveyed into an annulus 26104 defined between the tubular inner mandrel 26006 and the tubular extender barrel 26052 proximate an end face of the inner mandrel tubular piston 26062.

In an exemplary embodiment, as illustrated in FIGS. 15F1 to 15F5, the continued injection of the fluidic material 26100 into the extension actuator assembly 26 will then displace the inner mandrel tubular piston 26062 downwardly in a direction 26106. As a result, the tubular connecting rod 26060 and the tubular lower tool joint 26076 are also displaced downwardly in the direction 26106.

In an exemplary embodiment, as illustrated in FIGS. 15G1 to 15G5, the continued injection of the fluidic material 26100 into the extension actuator assembly 26 will then further displace the inner mandrel tubular piston 26062 downwardly in the direction 26106 until an end face of the inner flange 26062*d* of the inner mandrel tubular piston engages an end face of the lower pull-nut tube 26008. As a result, the lower pull-nut tube 26008, the tubular inner mandrel 26006, the upper pull-nut tube 26004, and the tubular lock mandrel 26010 are also displaced downwardly in the direction 26106 thereby shearing the shear pins, 26064*a* and 26064*b*, and disengaging the tubular lock mandrel from the tubular release body 26040.

The continued injection of the fluidic material 26100 into the extension actuator assembly 26 will then further displace the tubular lock mandrel 26010 downwardly in the direction 26106 thereby displacing the external flanges, 26010*i* and 26010*j*, of the tubular lock mandrel out of engagement with the internal flanges, 26012*a* and 26012*b*, and 26014*a* and 26014*b*, of the first and second locking dogs, 26012 and 26014, respectively. As a result, a spring bias force in an inner radial direction is applied by the spring arms, 26012*d* and 26012*e*, and 26014*d* and 26014*e*, of the first and second locking dogs, 26012 and 26014, respectively, to the first and second locking dogs thereby displacing the first and second locking dogs in an inner radial direction out of engagement with the portion 100*a* of the expandable wellbore casing 100. As a result, the expandable wellbore casing 100 is no longer locked to the first and second locking dogs, 26012 and 26014, of the extension actuator assembly 26.

In an exemplary embodiment, during operation of the extension actuator assembly 26, the expandable wellbore casing 100 may also be un-locked from engagement with the first and second locking dogs, 26012 and 26014, of the extension actuator assembly by increasing the operating pressure of the fluidic material 26100 above a predetermined level sufficient to rupture the burst disk 26034. As a result, the fluidic material 26100 will enter an annulus 26108 defined between the tubular lock mandrel 26010 and the tubular release body 26040. As a result, the tubular lock mandrel 26010 will be displaced downwardly in the direction 26106 thereby displacing the external flanges, 26010*i* and 26010*j*, of the tubular lock mandrel out of engagement with the internal flanges, 26012*a* and 26012*b*, and 26014*a* and 26014*b*, of the first and second locking dogs, 26012 and 26014, respectively. As a result, a spring bias force in an inner radial direction is applied by the spring arms, 26012*d* and 26012*e*, and 26014*d* and 26014*e*, of the first and second locking dogs, 26012 and 26014, respectively, to the first and second locking dogs thereby displacing the first and second locking dogs in an inner radial direction out of engagement with the portion 100*a* of the expandable wellbore casing 100. As a result, the expandable wellbore casing 100 is no longer locked to the first and second locking dogs, 26012 and 26014, of the extension actuator assembly 26. In an exemplary embodiment, the predetermined operating pressure of the fluidic material 26100 sufficient to rupture the burst disk 26034 is selected to provide a release of the expandable wellbore casing 100 from engagement with the first and second locking dogs, 26012 and 26104, in the event of an emergency operating condition during the operation of the system 10.

In an exemplary embodiment, the pressurization of the longitudinal passages 26004*a*, 26006*a*, and 26008*a* of the upper pull-nut tube 26004, tubular inner mandrel 26006, and lower pull-nut tube 26008, respectively, caused by the injection of the fluidic material 26100 may be further enhanced by blocking the flow of the fluidic material to those portions of the system 10 downstream from the extension actuator assembly 26 by, for example, blocking flow through a flow restriction defined in one or more of the elements of the system downstream of the extension actuator assembly by placing a ball or plug in one or more of those flow restrictions.

In an exemplary embodiment, the adjustable bell section expansion cone assembly 28 operates and is provided substantially, at least in part, as disclosed in one or more of the following: (1) PCT patent application Ser. No. PCT/US02/36157, filed on Nov. 12, 2002, and/or (2) PCT patent application Ser. No. PCT/US02/36267, filed on Nov. 12, 2002, and/or (3) PCT patent application Ser. No. PCT/US03/04837, 25791.95.02, filed on Feb. 29, 2003, and/or (4) PCT patent application Ser. No. PCT/US03/29859, filed on Sep. 22, 2003, and/or (5) PCT patent application Ser. No. PCT/US03/14153, filed on Nov. 13, 2003, and/or (6) PCT patent application Ser. No. PCT/US03/18530, filed on Jun. 11, 2003, and/or (7) PCT patent application Ser. No. PCT/US04/07711, filed on Mar. 11, 2004, and/or (8) PCT patent application Ser. No. PCT/US04/009434, filed on Mar. 26, 2004, and/or (9) PCT patent application Ser. No. PCT/US04/010317, filed on Apr. 2, 2004, and/or (10) PCT patent application Ser. No. PCT/US04/010712, filed on Apr. 7, 2004, and/or (11) PCT patent application Ser. No. PCT/US04/010762, filed on Apr. 6, 2004, and/or PCT application Ser. No. PCT/US04/011973, filed on Apr. 15, 2004, the disclosures of which are incorporated herein by reference.

In an exemplary embodiment, as illustrated in FIGS. 16-1 and 16-2, 16A1 to 16A2, 16B1 to 16B2, 16C, 16D, 16E, 16F, 16G, 16H, 16I, 16*j*, 16K, 16L, 16M, 16N, 16O, 16P, 16R, 16S, 16T, 16U, 16V, 16W, 16X, 16Y, 16Z1 to 16Z4, 16AA1 to 16AA4, 16AB1 to 16AB4, 16AC1 to 16AC4, 16AD, and 16AE, the adjustable bell section expansion cone assembly 28 includes an upper tubular tool joint 28002 that defines a longitudinal passage 28002*a* and mounting holes, 28002*b* and 28002*c*, and includes an internal threaded connection 28002*d*, an inner annular recess 28002*e*, an inner annular recess 28002*f*, and an internal threaded connection 28002*g*. A tubular torque plate 28004 that defines a longitudinal passage 28004*a* and includes circumferentially spaced apart teeth 28004*b* is received within, mates with, and is coupled to the internal annular recess 28002*e* of the upper tubular tool joint 28002.

Circumferentially spaced apart teeth 28006*a* of an end of a tubular lower mandrel 28006 that defines a longitudinal passage 28006*b*, a radial passage 28006*ba*, and a radial passage 28006*bb* and includes an external threaded connection 28006*c*, an external flange 28006*d*, an external annular recess 28006*e* having a step 28006*f* at one end, an external annular recess 28006*g*, external teeth 28006*h*, an external threaded connection 28006*i*, and an external annular recess 28006*j* engage the circumferentially spaced apart teeth 28004*b* of the tubular torque plate 28004. An internal threaded connection 28008*a* of an end of a tubular toggle bushing 28008 that defines a longitudinal passage 28008*b*, an upper longitudinal slot 28008*c*, a lower longitudinal slot 28008*d*, mounting holes, 28008*e*, 28008*f*, 28008*g*, 28008*h*, 28008*i*, 28008*j*, 28008*k*, 28008*l*, 28008*m*, 28008*n*, 28008*o*, 28008*p*, 28008*q*, 28008*r*, 28008*s*, 28008*t*, 28008*u*, 28008*v*, 28008*w*, 28008*x*, 28008*xa*, and 28008*xb*, and includes an external annular recess 28008*y*, internal annular recess 28008*z*, external annular recess 28008*aa*, and an external annular recess 28008*ab* receives and is coupled to the external threaded connection 28006*c* of the tubular lower mandrel 28006.

A sealing element 28010 is received within the external annular recess 28008*y* of the tubular toggle bushing 28008 for sealing the interface between the tubular toggle bushing and the upper tubular tool joint 28002. A sealing element 28012 is received within the internal annular recess 28008*z* of the tubular toggle bushing 28008 for sealing the interface between the tubular toggle bushing and the tubular lower mandrel 28006.

Mounting screws, 28014*a* and 28014*b*, mounted within and coupled to the mounting holes, 28008*w* and 28008*x*, respectively, of the tubular toggle bushing 28008 are also received within the mounting holes, 28002*b* and 28002*c*, of the upper tubular tool joint 28002. Mounting pins, 28016*a*, 28016*b*, 28016*c*, 28016*d*, and 28016*e*, are mounted within the mounting holes, 28008*e*, 28008*f*, 28008*g*, 28008*h*, and 28008*i*, respectively. Mounting pins, 28018*a*, 28018*b*, 28018*c*, 28018*d*, and 28018*e*, are mounted within the mounting holes, 28008*t*, 28008*s*, 28008*r*, 28008*q*, and 28008*p*, respectively. Mounting screws, 28020*a* and 28020*b*, are mounted within the mounting holes, 28008*u* and 28008*v*, respectively.

A first upper toggle link 28022 defines mounting holes, 28022*a* and 28022*b*, for receiving the mounting pins, 28016*a* and 28016*b*, and includes a mounting pin 28022*c* at one end. A first lower toggle link 28024 defines mounting holes, 28024*a*, 28024*b*, and 28024*c*, for receiving the mounting pins, 28022*c*, 28016*c*, and 28016*d*, respectively and includes an engagement arm 28024*d*. A first trigger 28026 defines a mounting hole 28026*a* for receiving the mounting pin 28016*e* and includes an engagement arm 28026*b* at one end, an engagement member 28026*c*, and an engagement arm 28026*d* at another end.

A second upper toggle link 28028 defines mounting holes, 28028*a* and 28028*b*, for receiving the mounting pins, 28018*a* and 28018*b*, and includes a mounting pin 28028*c* at one end. A second lower toggle link 28030 defines mounting holes, 28030*a*, 28030*b*, and 28030*c*, for receiving the mounting pins, 28028*c*, 28018*c*, and 28018*d*, respectively and includes an engagement arm 28030*d*. A second trigger 28032 defines a mounting hole 28032*a* for receiving the mounting pin 28018*e* and includes an engagement arm 28032*b* at one end, an engagement member 28032*c*, and an engagement arm 28032*d* at another end.

An end of a tubular spring housing 28034 that defines a longitudinal passage 28034*a*, mounting holes, 28034*b* and 28034*c*, and mounting holes, 28034*ba* and 28034*ca*,and includes an internal flange 28034*d* and an internal annular recess 28034*e* at one end, and an internal flange 28034*f*, an internal annular recess 28034*g*, an internal annular recess 28034*h*, and an external threaded connection 28034*i* at another end receives and mates with the end of the tubular toggle bushing 28008. Mounting screws, 28035*a* and 28035*b*, are mounted within and coupled to the mounting holes, 28008*xb* and 28008*xa*, respectively, of the tubular toggle bushing 28008 and are received within the mounting holes, 28034*ba* and 28034*ca*,respectively, of the tubular spring housing 28034.

A tubular retracting spring ring 28036 that defines mounting holes, 28036*a* and 28036*b*, receives and mates with a portion of the tubular lower mandrel 28006 and is received within and mates with a portion of the tubular spring housing 28034. Mounting screws, 28038*a* and 28038*b*, are mounted within and coupled to the mounting holes, 28036*a* and 28036*b*, respectively, of the tubular retracting spring ring 28036 and extend into the mounting holes, 28034*b* and 28034*c*, respectively, of the tubular spring housing 28034.

Casing diameter sensor springs, 28040*a* and 28040*b*, are positioned within the longitudinal slots, 28008*c* and 2808*d*, respectively, of the tubular toggle bushing 28008 that engage the engagement members, 28026*c* and 28032*c*, and engagement arms,28026*d* and 28032*d*, of the first and second triggers, 28026 and 28032, respectively. An inner flange 28042*a* of an end of a tubular spring washer 28042 mates with and receives a portion of the tubular lower mandrel 28006 and an end face of the inner flange of the tubular spring washer is positioned proximate and end face of the external flange 28006*d* of the tubular lower mandrel. The tubular spring washer 28042 is further received within the longitudinal passage 28034*a* of the tubular spring housing 28034.

An end of a retracting spring 28044 that receives the tubular lower mandrel 28006 is positioned within the tubular spring washer 28042 in contact with the internal flange 28042*a* of the tubular spring washer and the other end of the retracting spring is positioned in contact with an end face of the tubular retracting spring ring 28036.

A sealing element 28046 is received within the external annular recess 28006*j* of the tubular lower mandrel 28006 for sealing the interface between the tubular lower mandrel and the tubular spring housing 28034. A sealing element 28048 is received within the internal annular recess 28034*h* of the tubular spring housing 28034 for sealing the interface between the tubular spring housing and the tubular lower mandrel 28006.

An internal threaded connection 28050*a* of an end of a tubular upper hinge sleeve 28050 that includes an internal flange 28050*b* and an internal pivot 28050*c* receives and is coupled to the external threaded connection 28034*i* of the end of the tubular spring housing 28034.

An external flange 28052*a* of a base member 28052*b* of an upper cam assembly 28052, that is mounted upon and receives the lower tubular mandrel 28006, that includes an internal flange 28052*c* that is received within the external annular recess 28006*e* of the lower tubular mandrel 28006 and a plurality of circumferentially spaced apart tapered cam arms 28052*d* extending from the base member mates with and is received within the tubular upper hinge sleeve 28050. The base member 28052*b* of the upper cam assembly 28052 further includes a plurality of circumferentially spaced apart teeth 28052*f* that mate with and are received within a plurality of circumferentially spaced apart teeth 28034*j* provided on the end face of the tubular spring housing 28034 and an end face of the external flange 28052*a* of the base member of the upper cam assembly is positioned in opposing relation to an end face of the internal flange 28050*b* of the tubular upper hinge sleeve 28050. Each of the cam arms 28052*d* of the upper cam assembly 28052 include external cam surfaces 28052*e*. In an exemplary embodiment, the teeth 28052*f* of the base member 28052*b* of the upper cam assembly 28052 and the teeth 28034*j* provided on the end face of the tubular spring housing 28034 permit torsional loads to be transmitted between the tubular spring housing and the upper cam assembly.

A plurality of circumferentially spaced apart upper expansion segments 28054 are mounted upon and receive the lower tubular mandrel 28006 and each include an external pivot recess 28054*a* at one end for mating with and receiving the internal pivot 28050*c* of the tubular upper hinge sleeve 28050 and an external tapered expansion surface 28054*b* at another end and are pivotally mounted within the tubular upper hinge sleeve and are interleaved with the circumferentially spaced apart cam arms 28052*d* of the upper cam assembly 28052. The upper expansion segments 28054 are interleaved among the cam arms 28052*d* of the upper cam assembly 28052.

A plurality of circumferentially spaced apart lower expansion segments 28058 are mounted upon and receive the lower tubular mandrel 28006, are interleaved among the upper expansion segments 28054, are oriented in the opposite direction to the upper expansion segments 28054, each include an external pivot recess 28058*a* at one end and an external tapered expansion surface 28054*b* at another end and are positioned in opposing relation to corresponding circumferentially spaced apart cam arms 28052*d* of the upper cam assembly 28052.

A lower cam assembly 28060 is mounted upon and receives the lower tubular mandrel 28006 that includes a base member 28060*a* having an external flange 28060*b*, a plurality of circumferentially spaced apart cam arms 28060*d* that extend from the base member that each include external cam surfaces 28060*e* and define mounting holes 28060*f* and 28060*g*. The base member 28060*a* of the lower cam assembly 28060 further includes a plurality of circumferentially spaced apart teeth 28060*h*. The circumferentially spaced apart cam arms 28060*d* of the lower cam assembly 28060 are interleaved among the lower expansion segments 28058 and the circumferentially spaced apart cam arms 28052*d* of the upper cam assembly 28052 and positioned in opposing relation to corresponding upper expansion segments 28054.

Mounting screws, 28062*a*, 28062*b*, 28062*c*, and 28062*e*, are mounted within the corresponding mounting holes, 28060*f* and 28060*g*, of the lower cam assembly 28060 and are received within the external annular recess 28006*g* of the lower cam assembly 28060.

A tubular lower hinge sleeve 28064 that receives the lower expansion segments 28058 and the lower cam assembly 28060 includes an internal flange 28064*a* for engaging the external flange 28060*b* of the base member of the lower cam assembly 28060, an internal pivot 28064*b* for engaging and receiving the external pivot recess 28058*a* of the lower expansion segments 28058 thereby pivotally mounting the lower expansion segments within the tubular lower hinge sleeve, and an internal threaded connection 28064*c*.

An external threaded connection 28066*a* of an end of a tubular sleeve 28066 that defines mounting holes, 28066*b* and 28066*c*, and includes an internal annular recess 28066*d* having a shoulder 28066*e*, an internal flange 28066*f*, and an internal threaded connection 28066*g* at another end is received within and coupled to the internal threaded connection 28064*c* of the tubular lower hinge sleeve 28064. An external threaded connection 28068*a* of an end of a tubular member 28068 that defines a longitudinal passage 28068*b* and mounting holes, 28068*c* and 28068*d*, and includes an external annular recess 28068*e*, and an external threaded connection 28068*f* at another end is received within and is coupled to the internal threaded connection 28066*g* of the tubular sleeve 28066.

Mounting screws, 28070*a* and 28070*b*, are mounted in and coupled to the mounting holes, 28068*c* and 28068*d*, respectively, of the tubular member 28068 that also extend into the mounting holes, 28066*b* and 28066*c*, respectively, of the tubular sleeve 28066. A sealing element 28072 is received within the external annular recess 28068*e* of the tubular member 28068 for sealing the interface between the tubular member and the tubular sleeve 28066.

An internal threaded connection 28074*a* of a tubular retracting piston 28074 that defines a longitudinal passage 28074*b* and includes an internal annular recess 28074*c* and an external annular recess 28074*d* receives and is coupled to the external threaded connection 28006*i* of the tubular lower mandrel 28006. A sealing element 28076 is received within the external annular recess 28074*d* of the tubular retracting piston 28074 for sealing the interface between the tubular retracting piston and the tubular sleeve 28066. A sealing element 28078 is received within the internal annular recess 28074*c* of the tubular retracting piston 28074 for sealing the interface between the tubular retracting piston and the tubular lower mandrel 28006.

Locking dogs 28080 mate with and receive the external teeth 28006*h* of the tubular lower mandrel 28006. A spacer ring 28082 is positioned between an end face of the locking dogs 28080 and an end face of the lower cam assembly 28060. A release piston 28084 mounted upon the tubular lower mandrel 28006 defines a radial passage 28084*a* for mounting a burst disk 28086 includes sealing elements, 28084*b*, 28084*c*, and 28084*d*. The sealing elements, 28084*b* and 28084*d*, sealing the interface between the release piston 28084 and the tubular lower mandrel 28006. An end face of the release piston 28084 is positioned in opposing relation to an end face of the locking dogs 28080.

A release sleeve 28088 that receives and is mounted upon the locking dogs 28080 and the release piston 28084 includes an internal flange 28088*a* at one end that sealingly engages the tubular lower mandrel 28006. A bypass sleeve 28090 that receives and is mounted upon the release sleeve 28088 includes an internal flange 28090*a* at one end.

In an exemplary embodiment, during operation of the adjustable bell section expansion cone assembly 28, the retracting spring 28044 is compressed and thereby applies a biasing spring force in a direction 28092 from the lower tubular mandrel 28006 to the tubular spring housing 28034 that, in the absence of other forces, moves and/or maintains the upper cam assembly 28052 and the upper expansion segments 28054 out of engagement with the lower expansion segments 28058 and the lower cam assembly 28060. In an exemplary embodiment, during operation of the adjustable bell section expansion cone assembly 28, an external threaded connection 26*a* of an end of the extension actuator assembly 26 is coupled to the internal threaded connection 28002*d* of the upper tubular tool joint 28002 and an internal threaded connection 30*a* of an end of the adjustable casing expansion cone assembly 30 is coupled to the external threaded connection 28068*f* of the tubular member 28068.

The upper cam assembly 28052 and the upper expansion segments 28054 may be brought into engagement with the lower expansion segments 28058 and the lower cam assembly 28060 by pressurizing an annulus 28094 defined between the lower tubular mandrel 28006 and the tubular spring housing 28034. In particular, injection of fluidic materials into the adjustable bell section expansion cone assembly 28 through the longitudinal passage 28006*b* of the lower tubular mandrel 28006 and into the radial passage 28006*ba* may pressurize the annulus 28094 thereby creating sufficient operating pressure to generate a force in a direction 28096 sufficient to overcome the biasing force of the retracting spring 28044. As a result, the spring housing 28034 may be displaced in the direction 28096 relative to the lower tubular mandrel 28006 thereby displacing the tubular upper hinge sleeve 28050, upper cam assembly 28052, and upper expansion segments 28054 in the direction 28096.

Figures 1, 16:
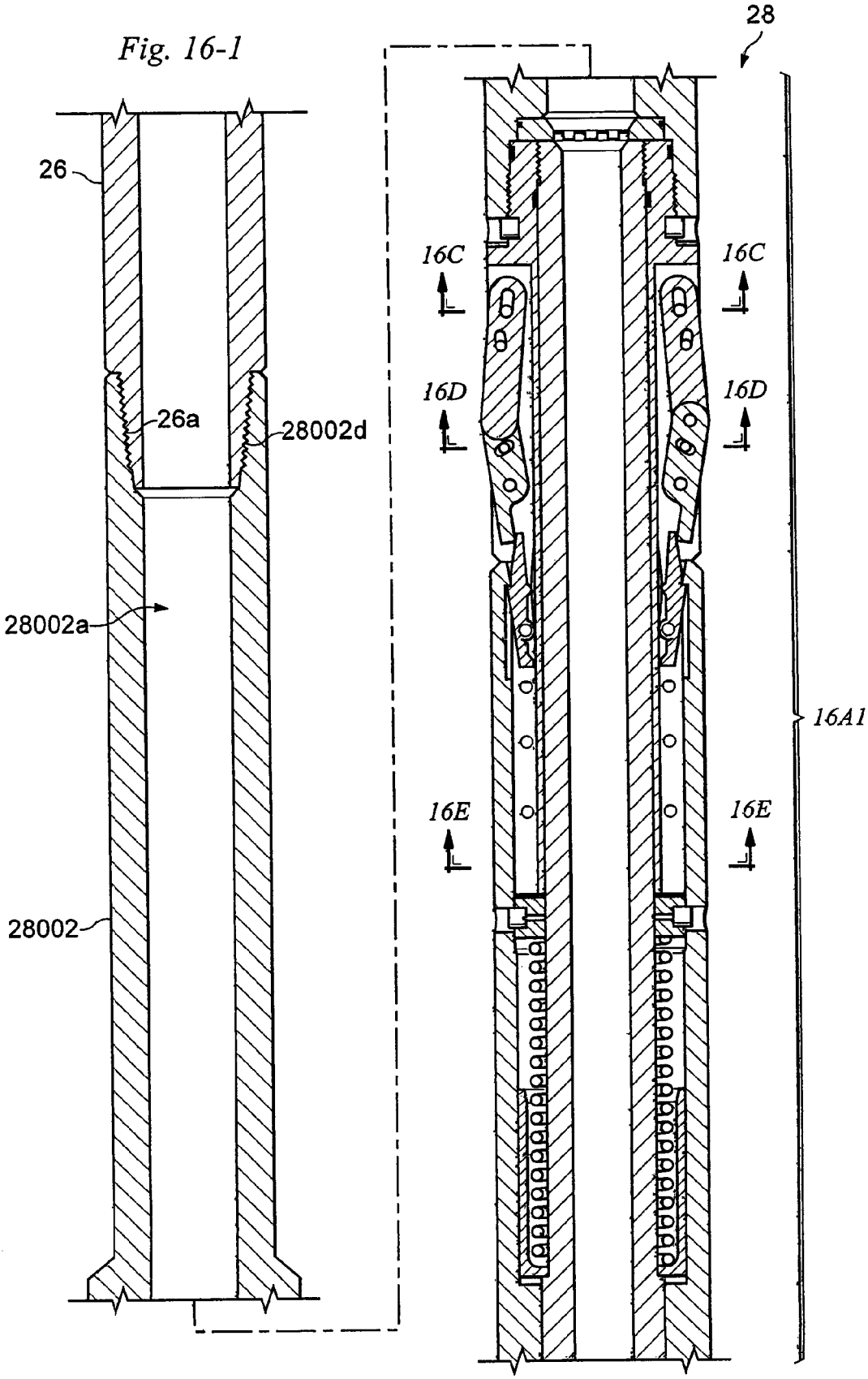
Figures 2, 16:
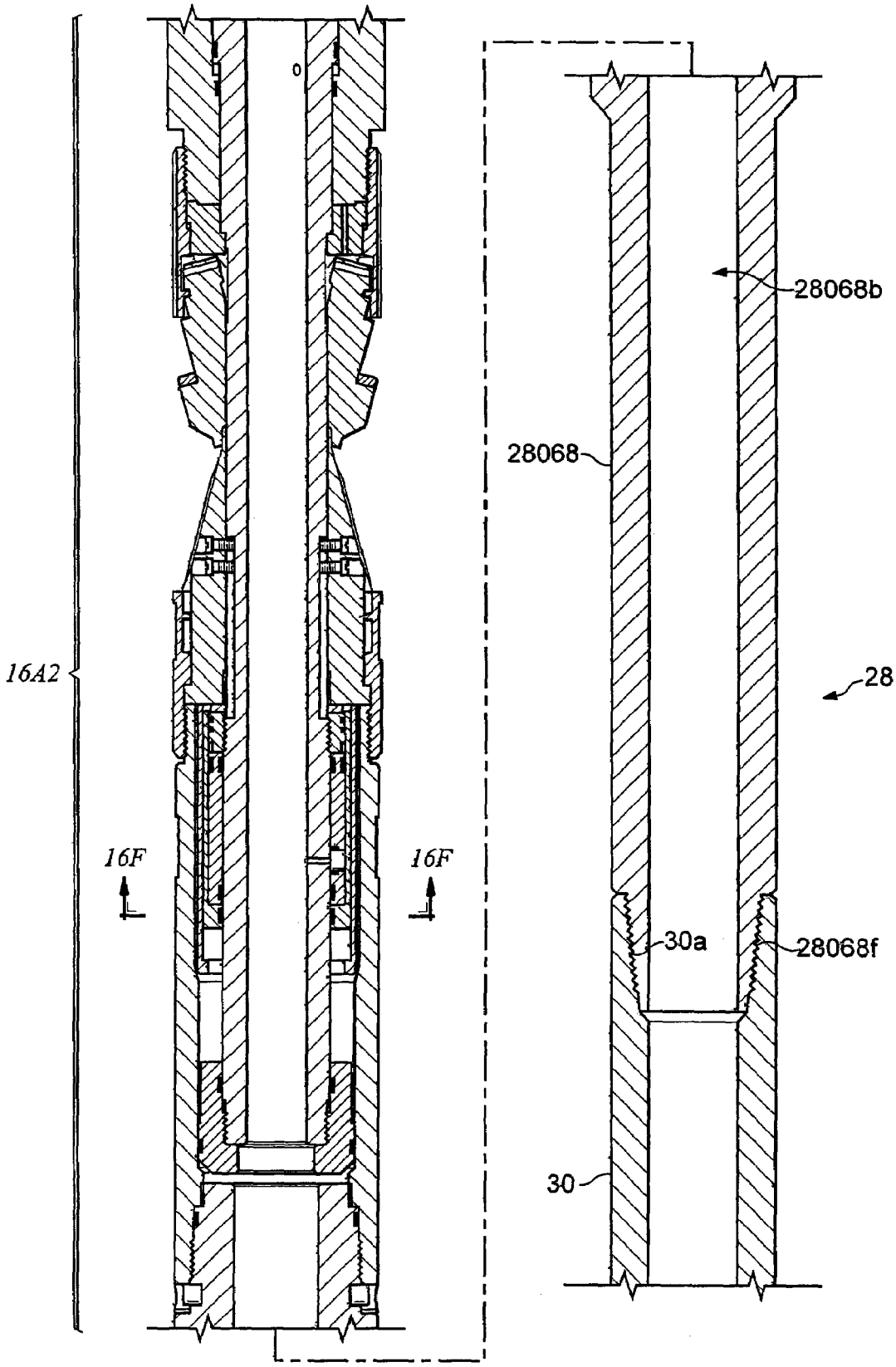
Figure 16C:
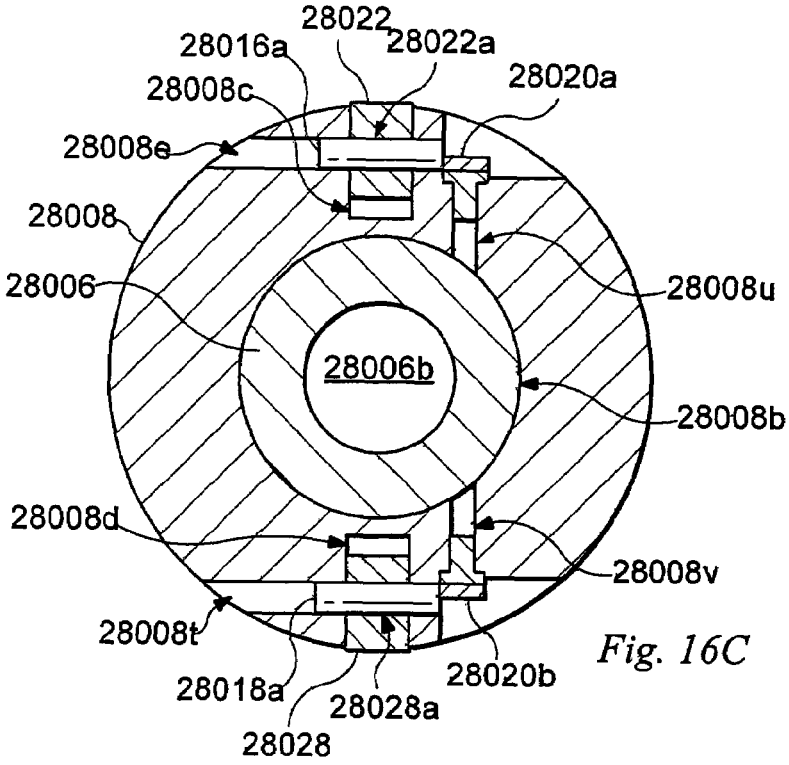
Figure 16D:
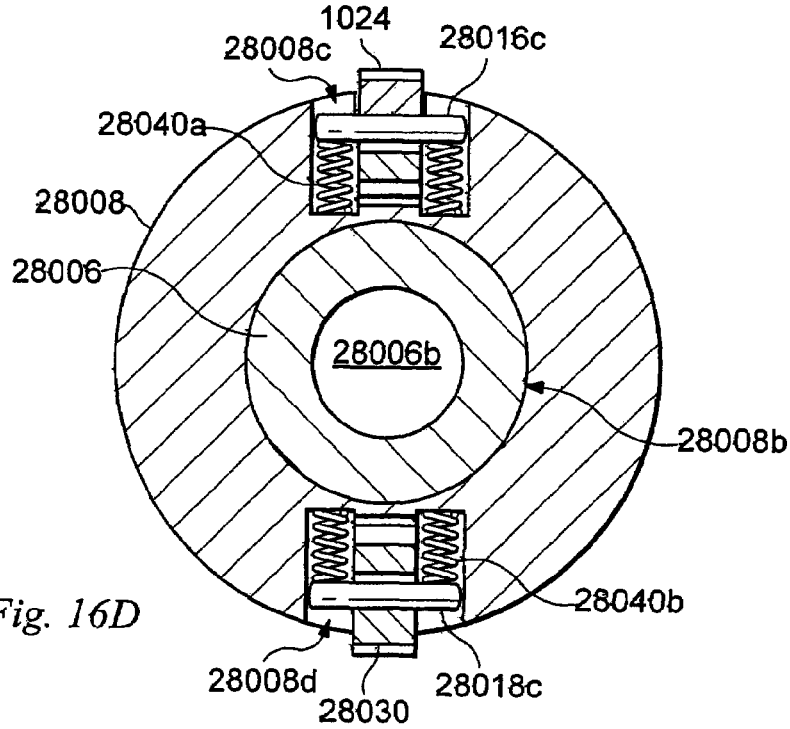
Figure 16E:
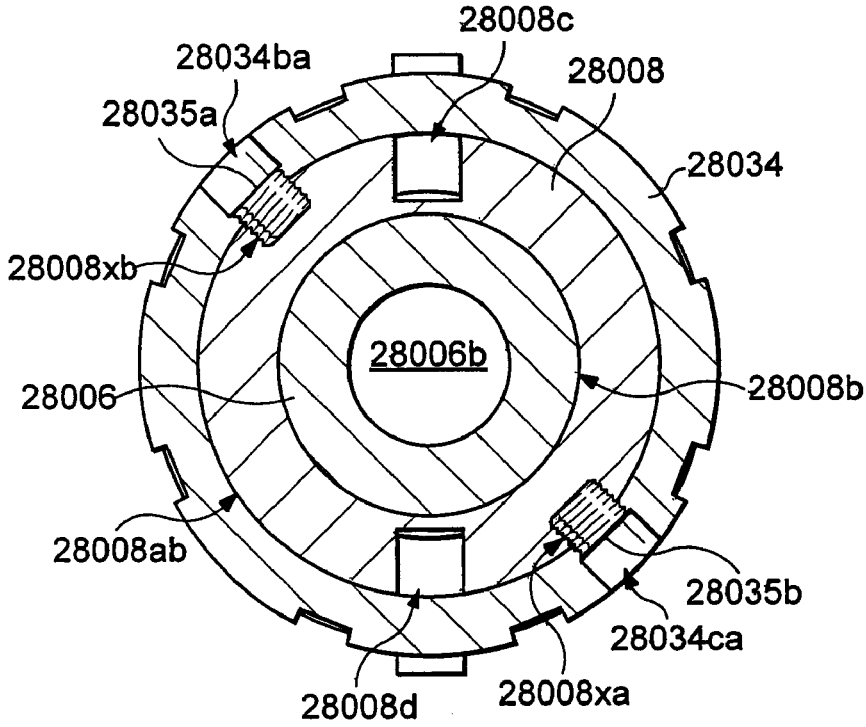
Figure 16F:
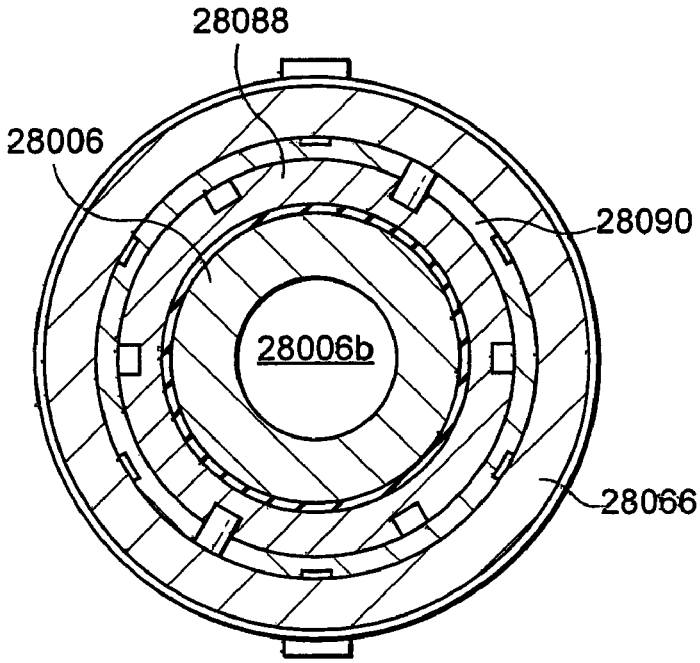
Figure 16G:
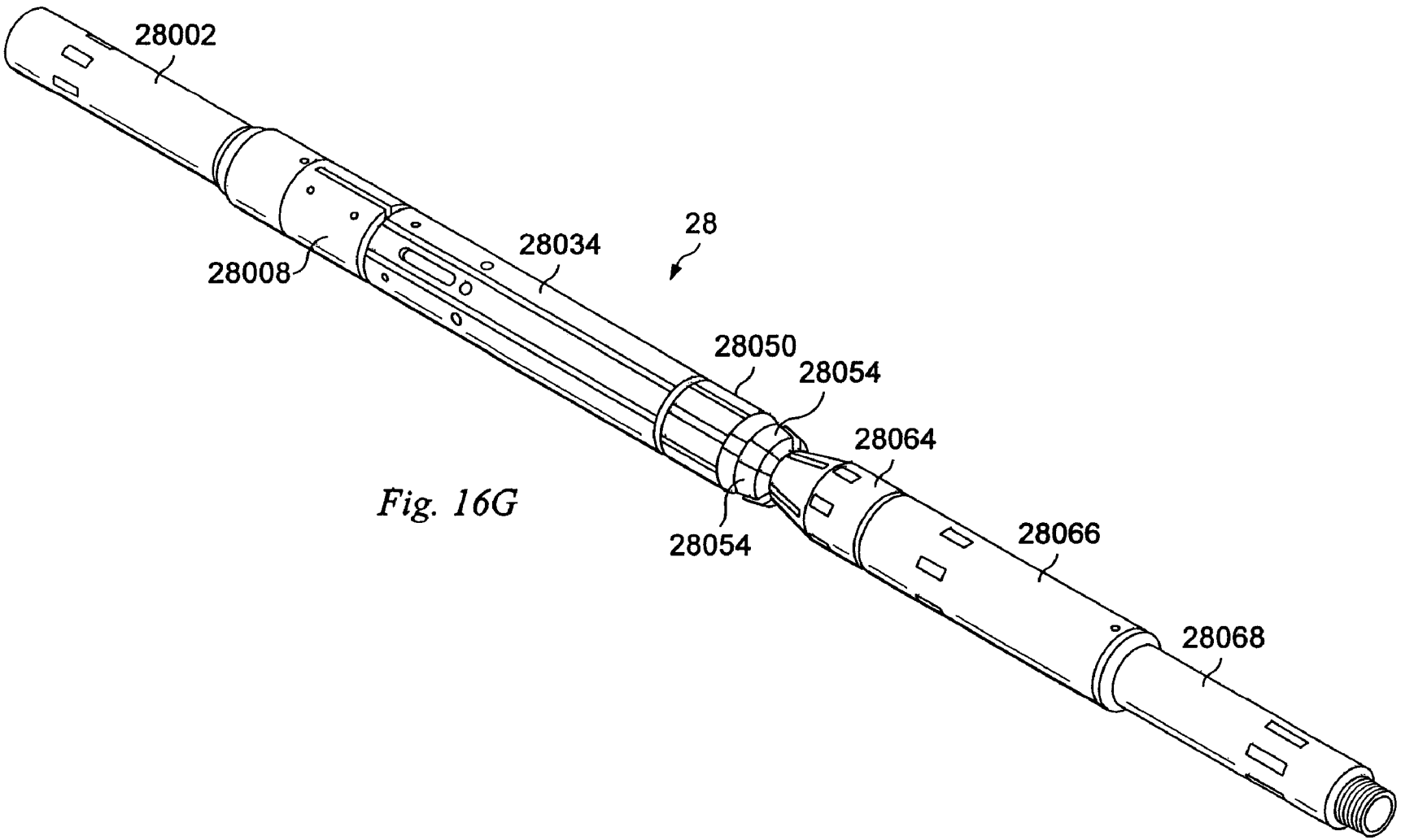
Figure 16H:
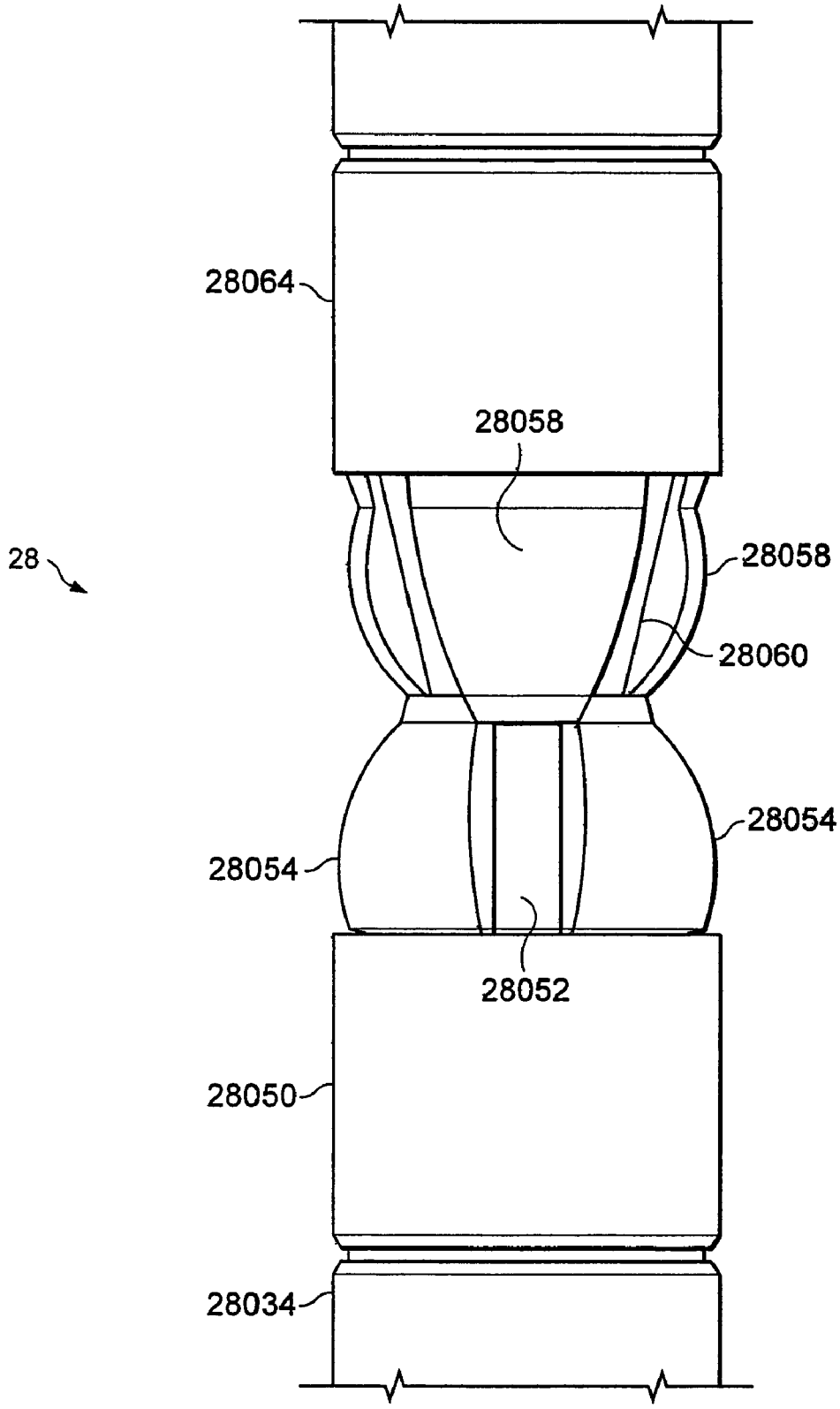
Figure 16I:
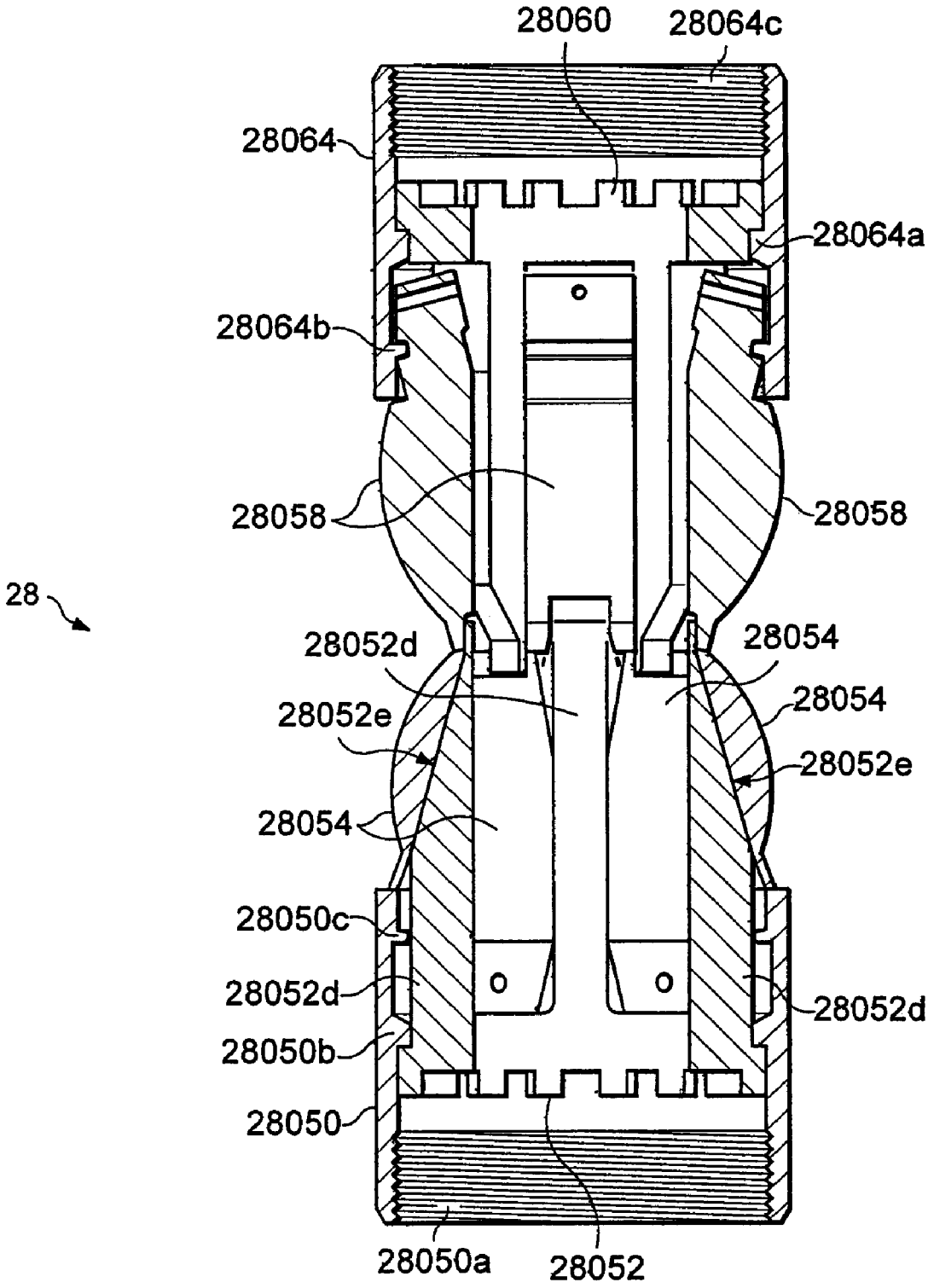
Figure 16J:
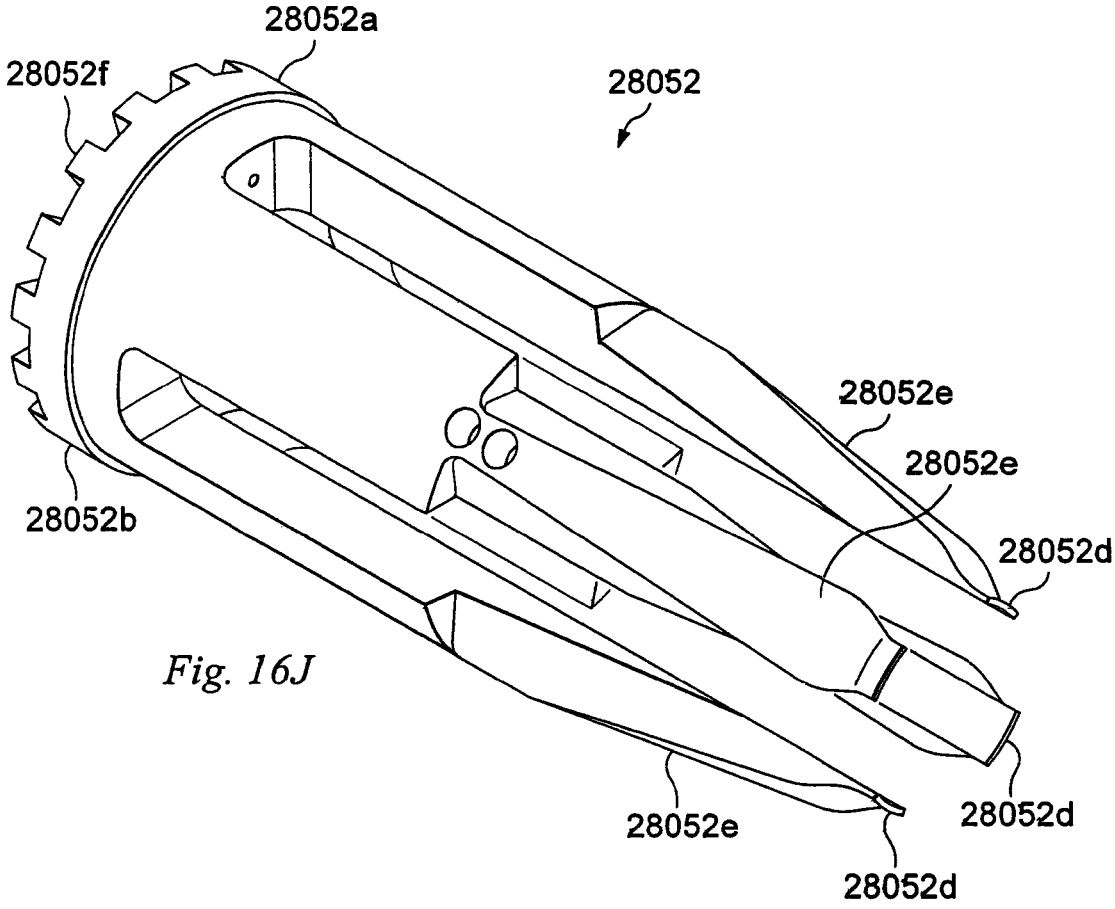
Figure 16K:
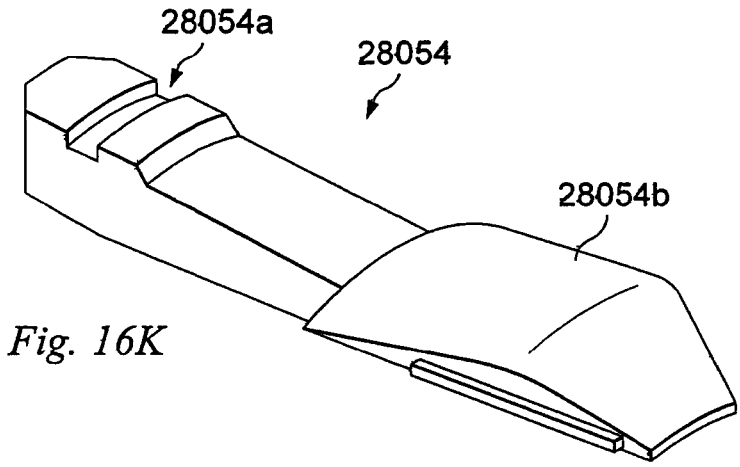
Figure 16L:
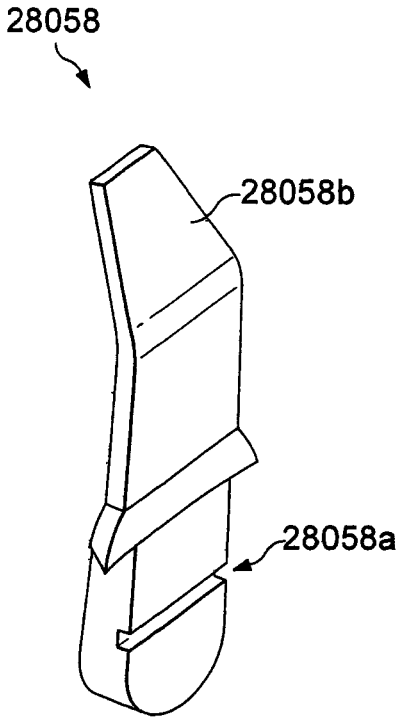
Figure 16M:
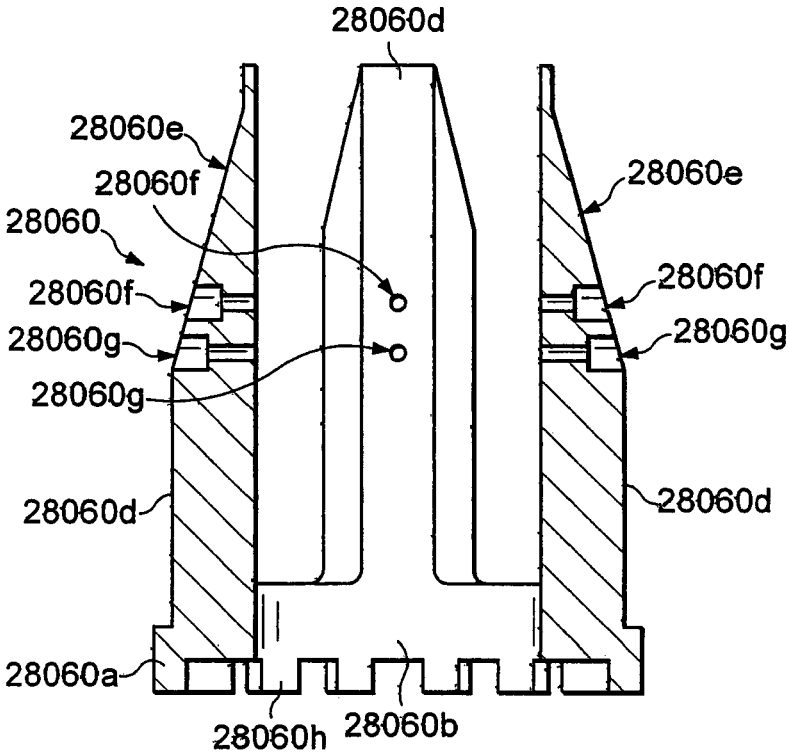
Figure 16N:
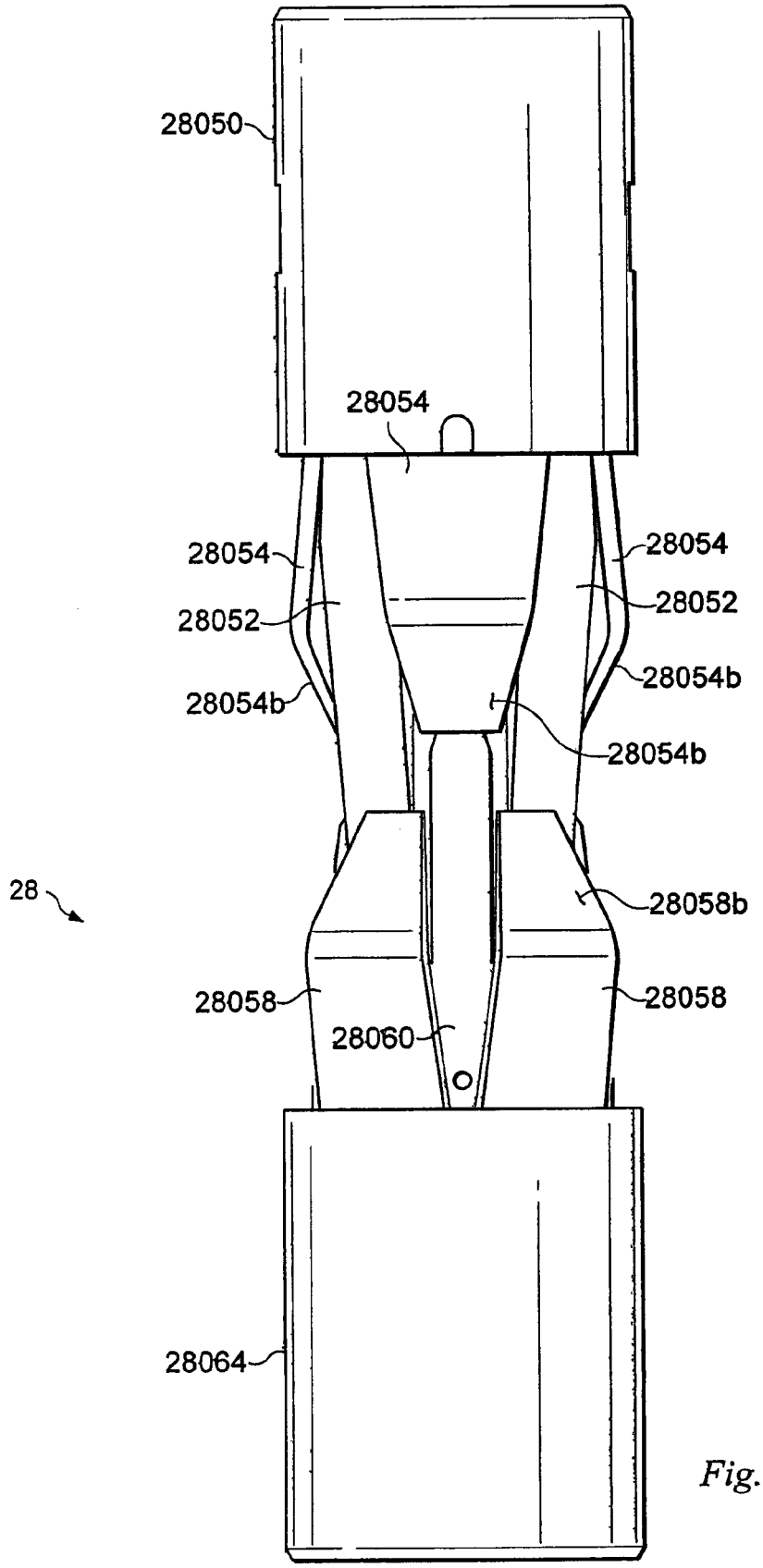
Figure 16O:
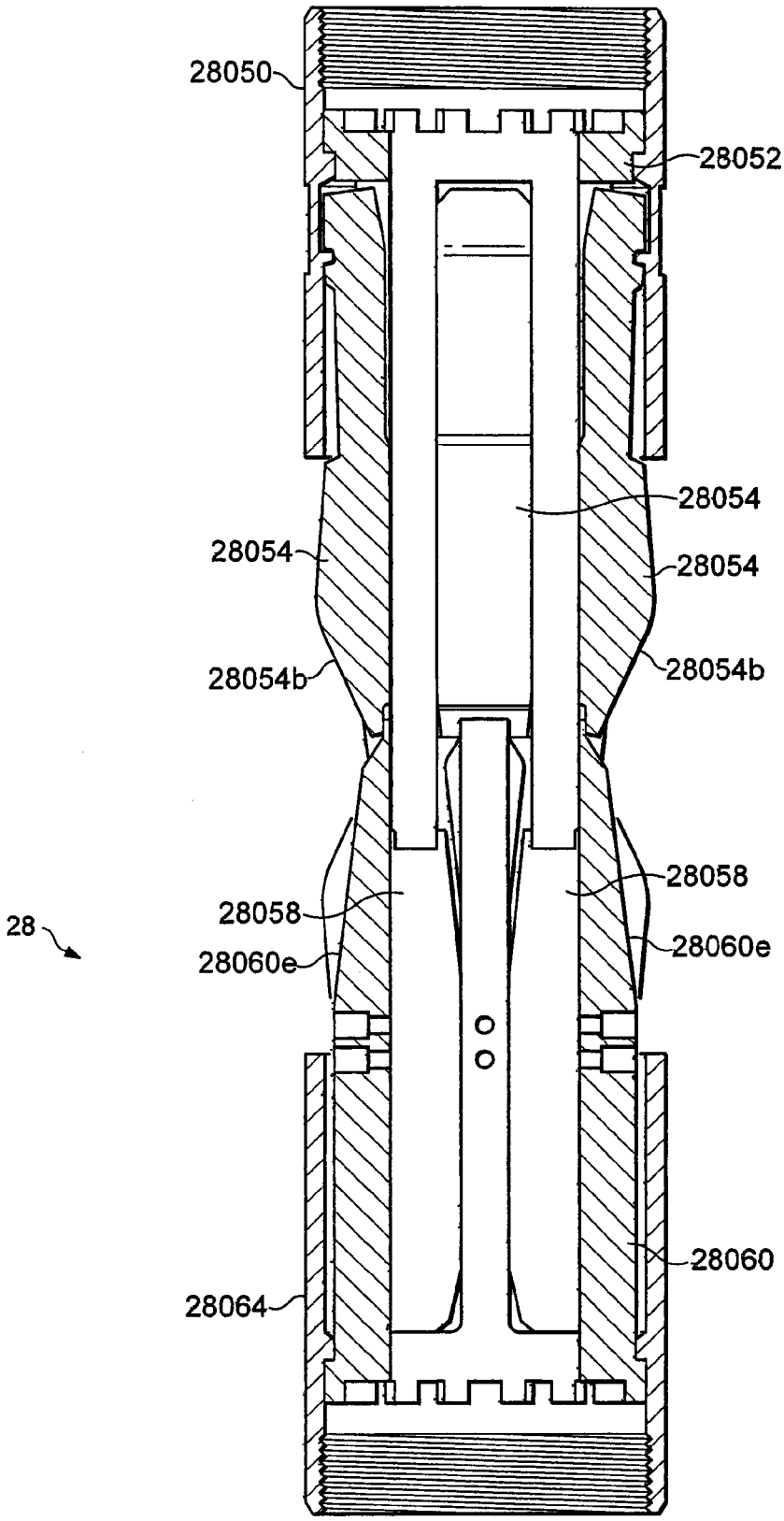
Figure 16P:
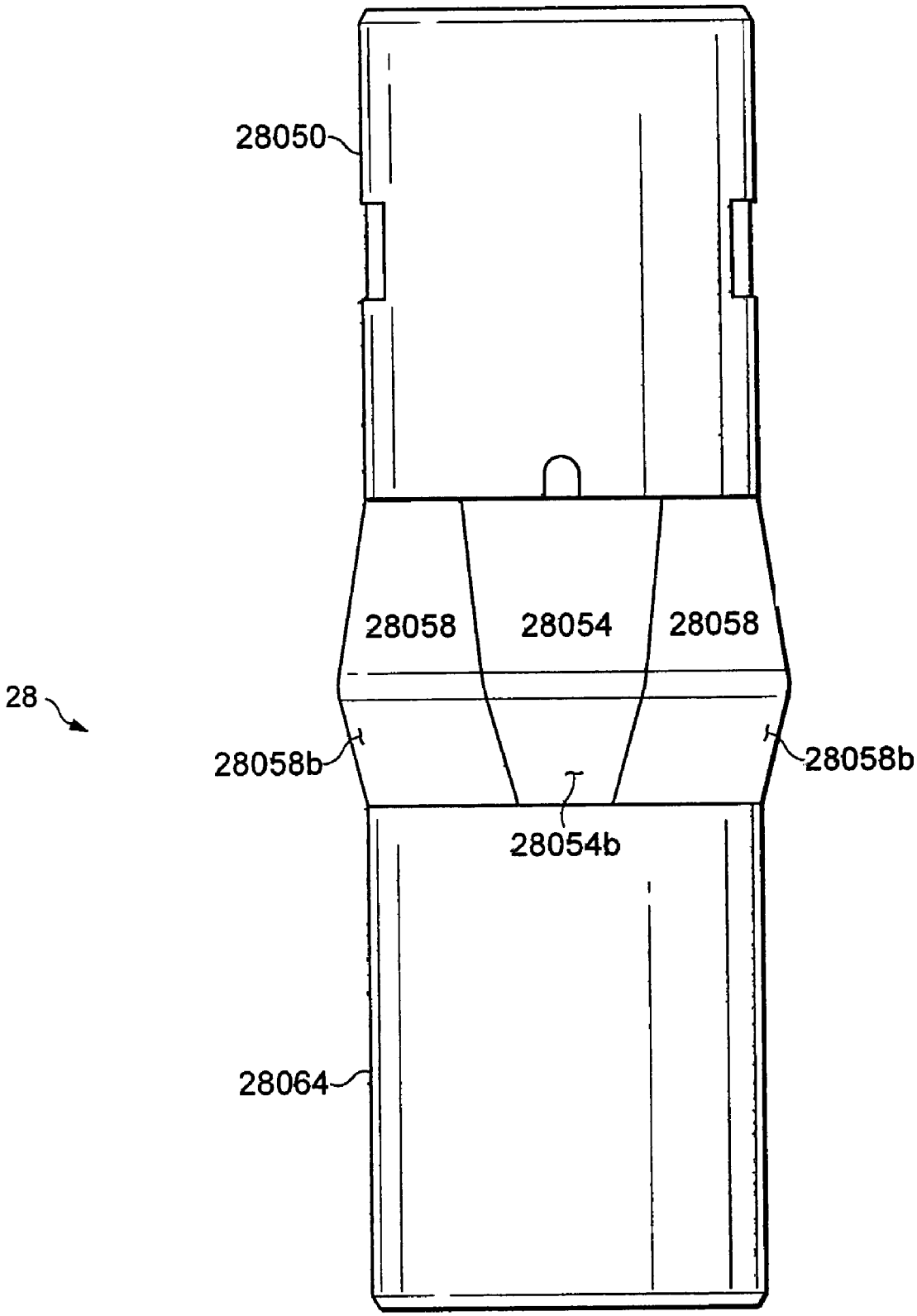
Figure 16R:
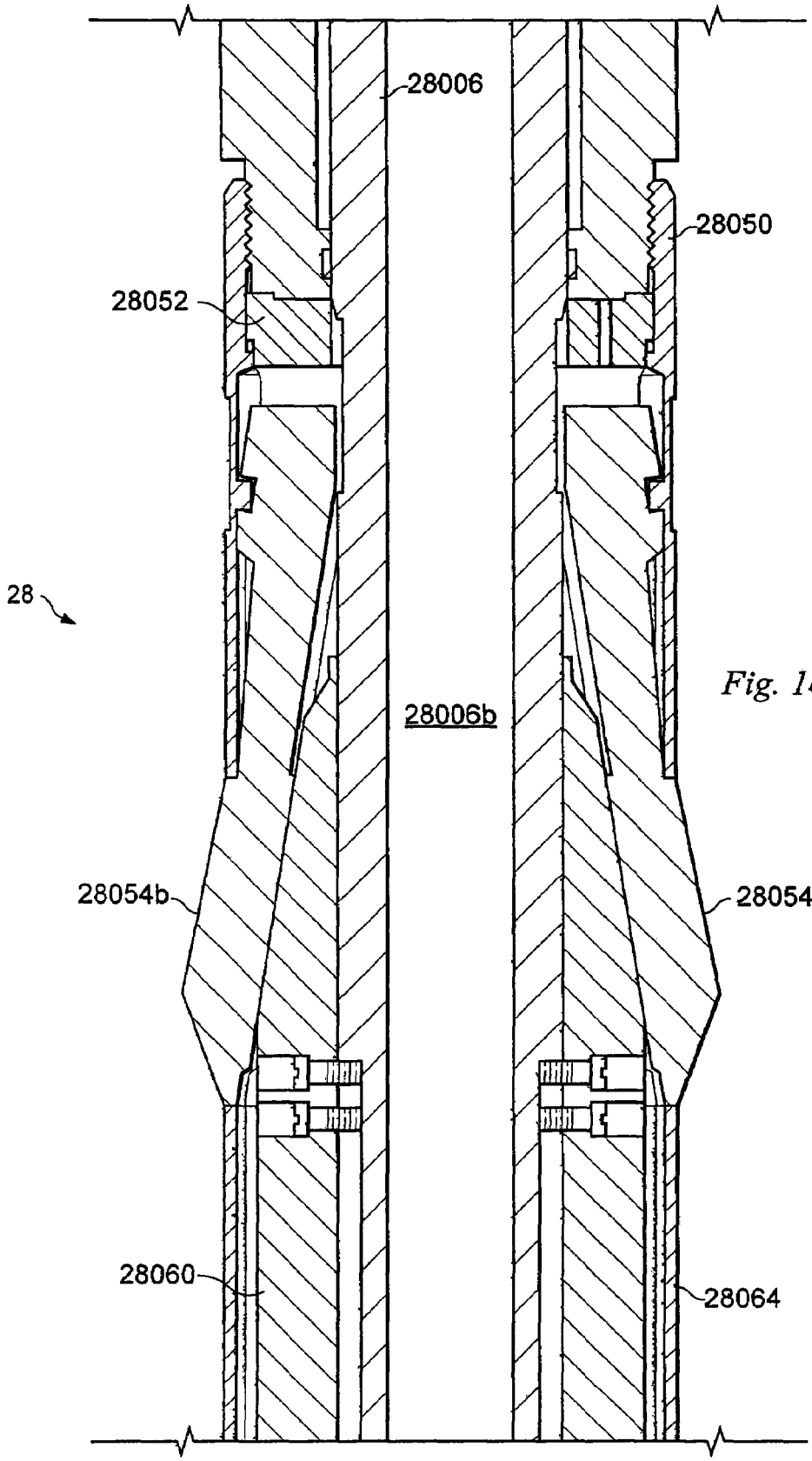
Figure 16S:
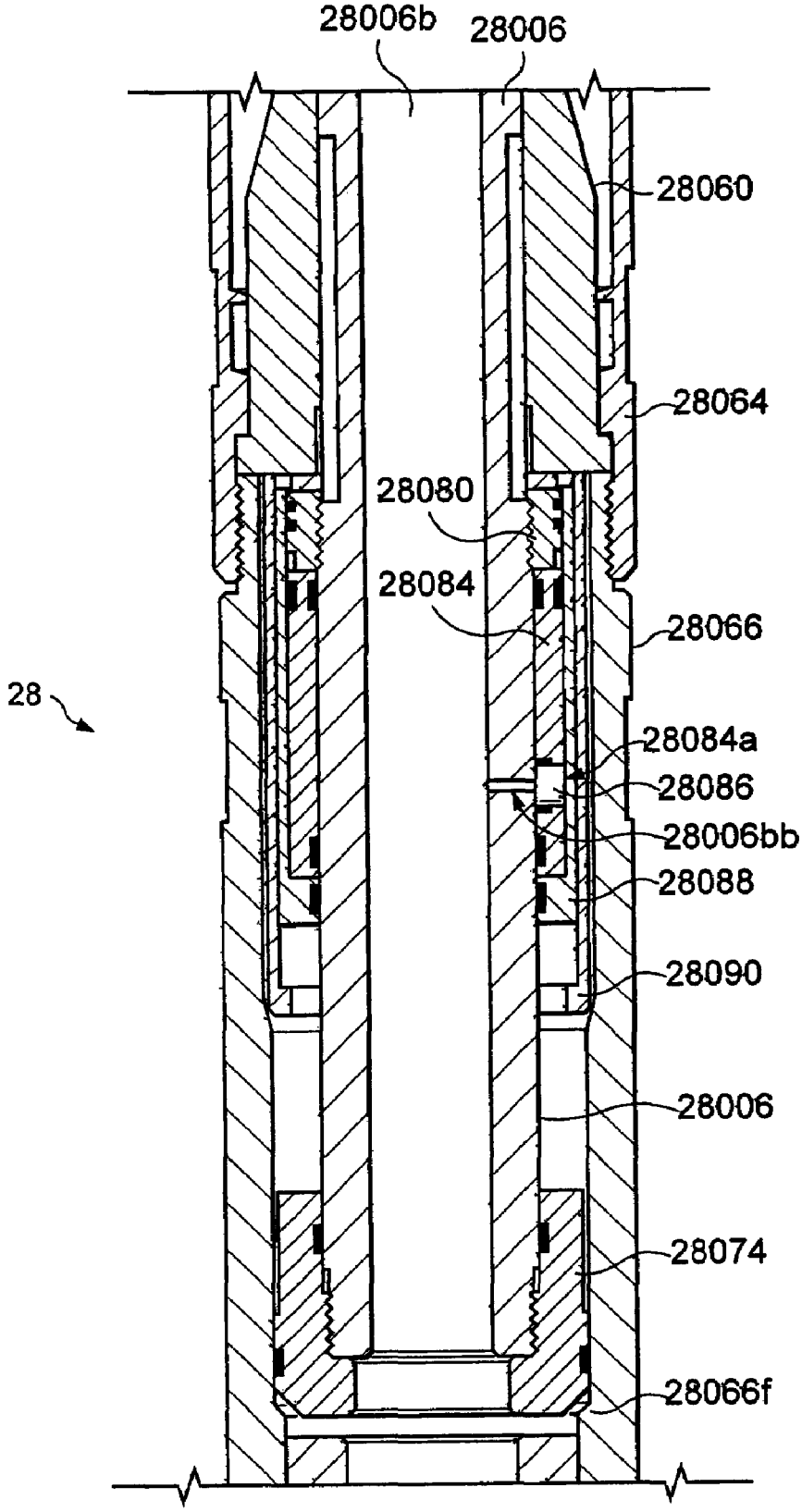

In an exemplary embodiment, as illustrated in FIGS. 16P and 16R, the displacement of the upper cam assembly 28052 and upper expansion segments 28054 in the direction 28096 will cause the lower expansion segments 28058 to ride up the cam surfaces 28052*e* of the cam arms 28052*d* of the upper cam assembly 28052 while also pivoting about the lower tubular hinge segment 28064, and will also cause the upper expansion segments 28054 to ride up the cam surfaces 28060*e* of the cam arms 28060*d* of the lower cam assembly 28060 while also pivoting about the upper tubular hinge segment 28050. In an exemplary embodiment, when the upper and lower expansion segments, 28054 and 28058, are brought into axial alignment, they define an outer expansion surface that is approximately contiguous in a circumferential direction and which provides an outer expansion surface that at least approximates a conical surface.

In an exemplary embodiment, during the operation of the adjustable bell section expansion cone assembly 28, when the upper and lower expansion segments, 28054 and 28058, brought into axial alignment into a radially expanded position, the upper and lower expansion segments, 28054 and 28058, are displaced relative to the expandable wellbore casing 100 to thereby radially expand and plastically deform at least a portion of the expandable wellbore casing. In an exemplary embodiment, during the radial expansion and plastic deformation of the expandable wellbore casing 100, the adjustable bell section expansion cone assembly 28 may then be rotated relative to the expandable wellbore casing to enhance and/or modify the rate at which the expandable wellbore casing is radially expanded and plastically deformed.

In an exemplary embodiment, the upper cam assembly 28052 and the upper expansion segments 28054 may be moved out of engagement with the lower expansion segments 28058 and the lower cam assembly 28060 by reducing the operating pressure within the annulus 28094.

Figure 16T:
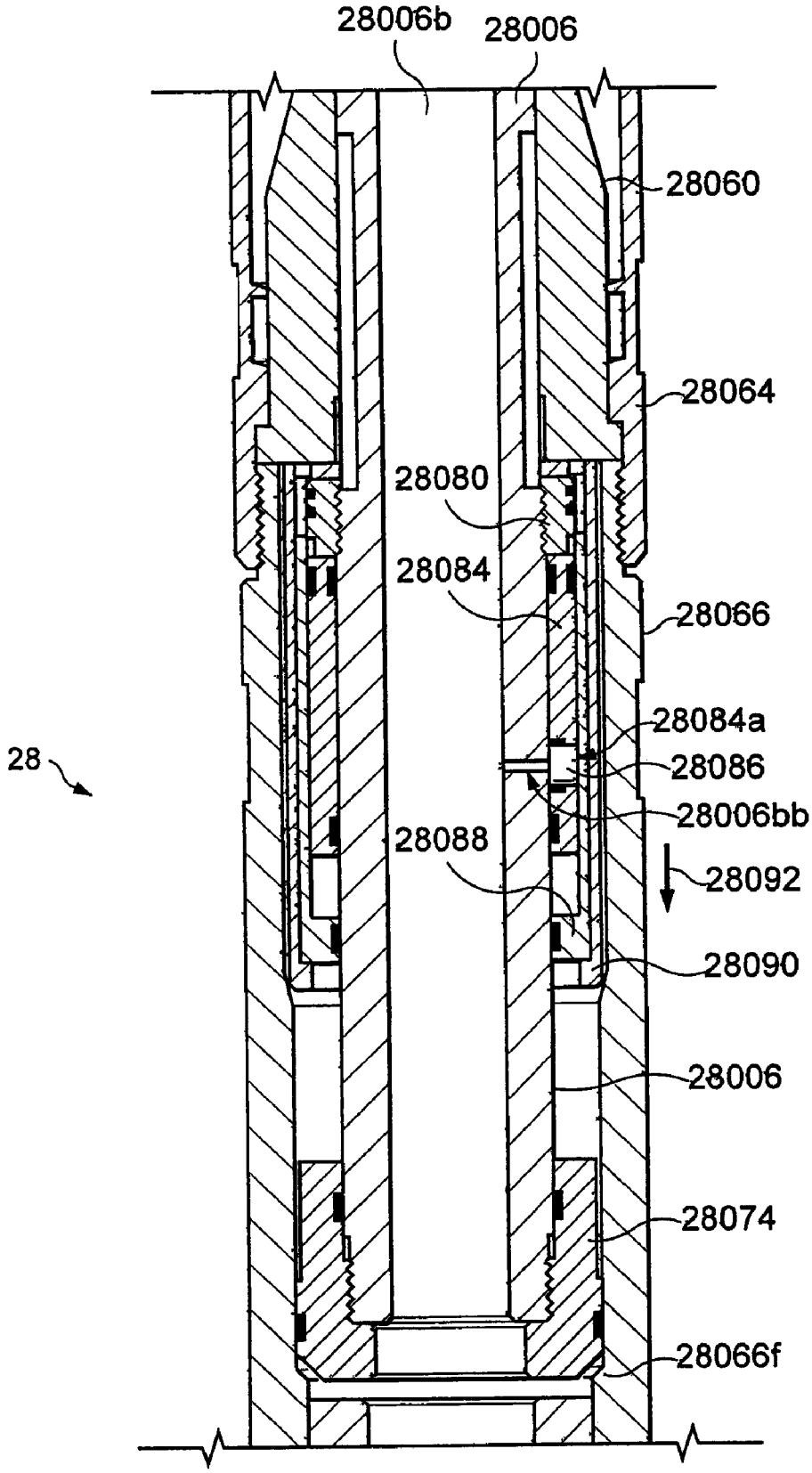

In an alternative embodiment, as illustrated in FIGS. 16S, 16T, 16U and 16V, during operation of the adjustable bell section expansion cone assembly 28, the upper cam assembly 28052 and the upper expansion segments 28054 may also be moved out of engagement with the lower expansion segments 28058 and the lower cam assembly 28060 by sensing the operating pressure within the longitudinal passage 28006*b* of the lower tubular mandrel 28006. In particular, as illustrated in FIG. 16T, if the operating pressure within the longitudinal passage 28006*b* and radial passage 28006*bb* of the lower tubular mandrel 28006 exceeds a predetermined value, the burst disc 28086 will open the passage 28084*a* thereby pressurizing the interior of the tubular release sleeve 28088 thereby displacing the tubular release sleeve 28088 downwardly in a direction 28092 away from engagement with the locking dogs 28080.

Figure 16U:
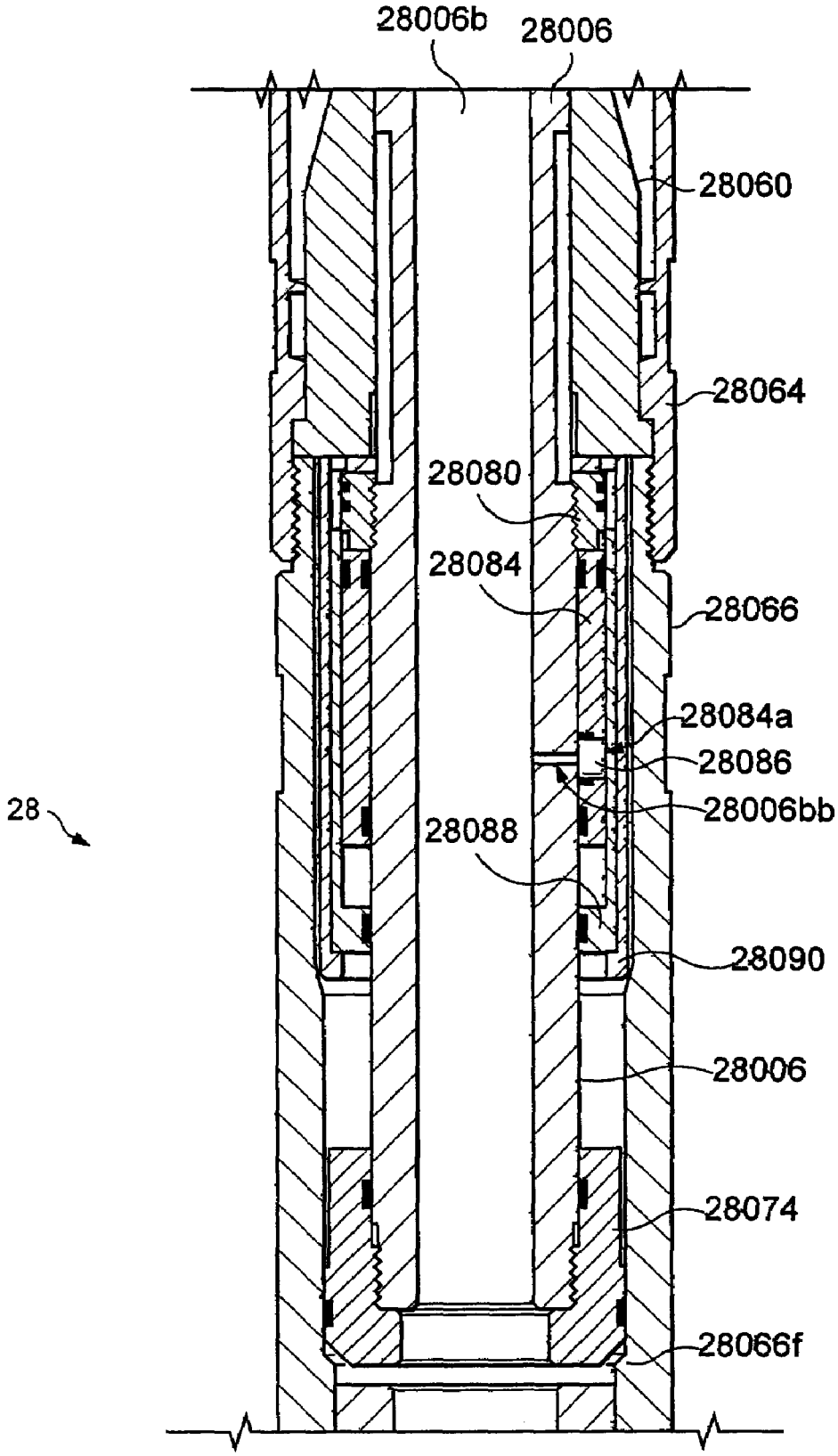

As a result, as illustrated in FIG. 16U, the locking dogs 28080 are displaced outwardly in the radial directed and thereby released from engagement with the lower tubular mandrel 28006 thereby permitting the lower expansion segments 28058 and the lower cam assembly 28060 to be displaced downwardly relative to the lower tubular mandrel.

Figure 16V:
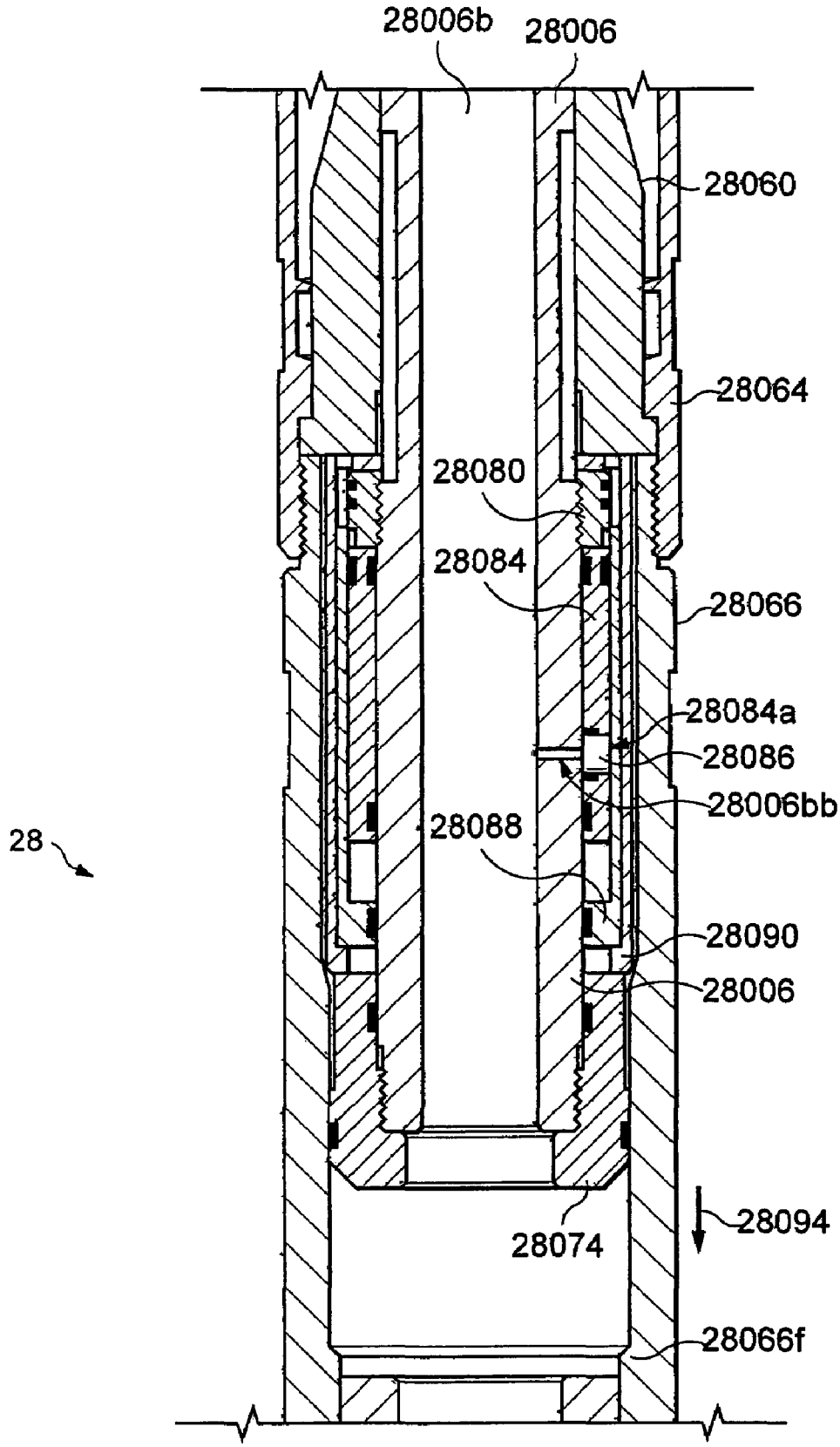

As a result, as illustrated in FIG. 16V, the operating pressure within the lower tubular mandrel 28066 may then cause the lower tubular mandrel to be displaced downwardly in the direction 28094 relative to the tubular lower mandrel 28006 and the retracting piston 28074. As a result, the lower tubular mandrel 28066, the lower expansion segments 28058, the lower cam assembly 28060, and tubular lower hinge sleeve 28064 are displaced downwardly in the direction 28094 relative to the tubular spring housing 28034 thereby moving the lower expansion segments 28058 and the lower cam assembly 28060 out of engagement with the upper cam assembly 28052 and the upper expansion segments 28054.

Figure 16W:
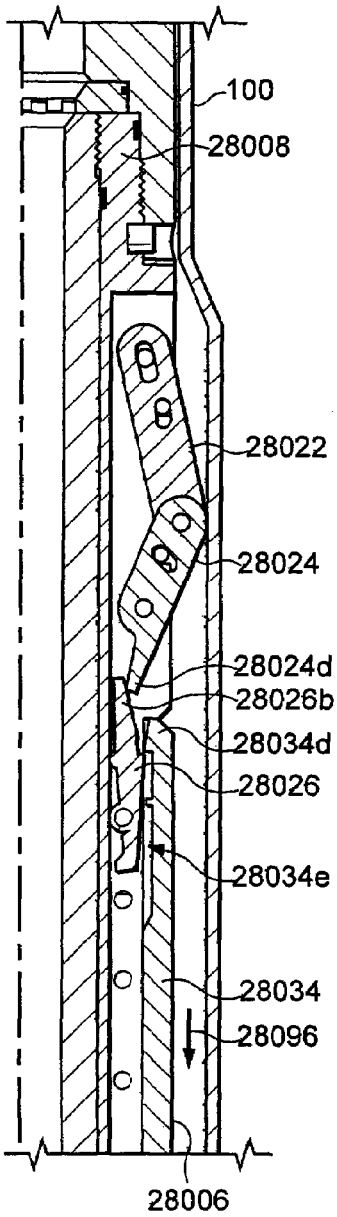
Figure 16X:
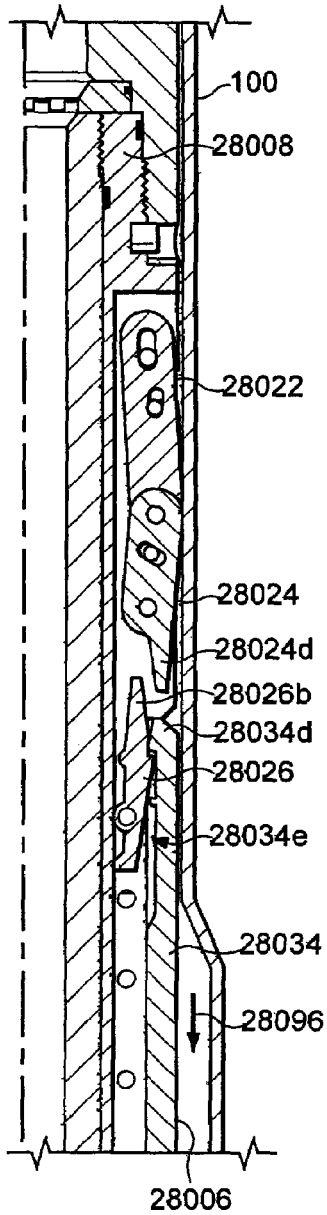
Figure 16Y:
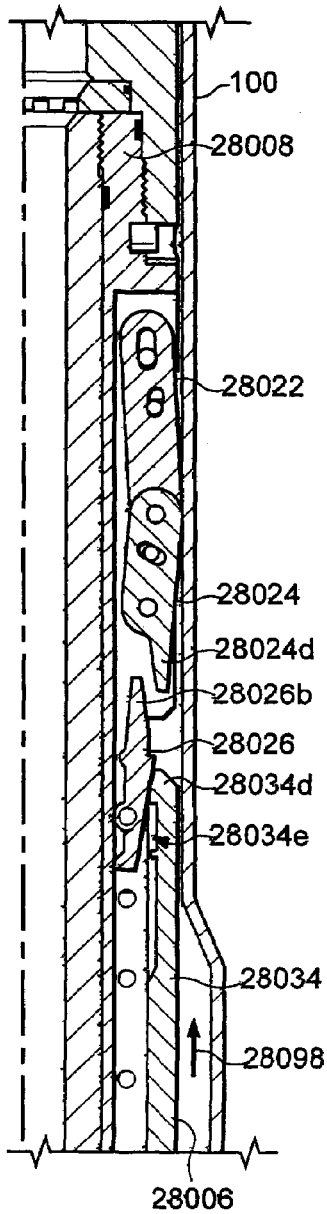

In an exemplary embodiment, as illustrated in FIGS. 16W, 16X, and 16Y, during operation of the adjustable bell section expansion cone assembly 28, the adjustable bell section expansion cone assembly senses the diameter of the expandable wellbore casing 100 using the upper toggle links, 28022 and 28028, lower toggle links, 28024 and 28030, and triggers, 28026 and 28032, and then prevents the engagement of the upper cam assembly 28052 and the upper expansion segments 28054 with the lower expansion segments 28058 and the lower cam assembly 28060.

In particular, as illustrated in FIG. 16W, anytime the upper toggle links, 28022 and 28028, and lower toggle links, 28024 and 28030, are positioned within a portion of the expandable wellbore casing 100 that has been radially expanded and plastically deformed by the system 10, the triggers, 28026 and 28032, will be pivoted by the engagement arms, 28024*d* and 28030*d*, of the lower toggle links, 28024 and 28030, to a position in which the triggers will no longer engage the internal flange 28034*d* of the end of the tubular spring housing 28034 thereby permitting the displacement of the tubular spring housing in the direction 28096. As a result, the upper cam assembly 28052 and the upper expansion segments 28054 can be brought into engagement with the lower expansion segments 28058 and the lower cam assembly 28060. In an exemplary embodiment, the upper toggle links, 28022 and 28028, and the lower toggle links, 28024 and 28030, are spring biased towards the position illustrated in FIG. 16W.

Conversely, as illustrated in FIG. 16X, anytime the upper toggle links, 28022 and 28028, and lower toggle links, 28024 and 28030, are positioned within a portion of the expandable wellbore casing 100 that has not been radially expanded and plastically deformed by the system 10, the triggers, 28026 and 28032, will be maintained in a position in which the triggers will engage the internal flange 28034*d* of the end of the tubular spring housing 28034 thereby preventing the displacement of the tubular spring housing in the direction 28096. As a result, the upper cam assembly 28052 and the upper expansion segments 28054 cannot be brought into engagement with the lower expansion segments 28058 and the lower cam assembly 28060. In an exemplary embodiment, the triggers, 28026 and 28032, are spring biased towards the position illustrated in FIG. 16X.

In an exemplary embodiment, as illustrated in FIG. 16Y, the tubular spring housing 28034 may be displaced upwardly in the direction 28098 even if the upper toggle links, 28022 and 28028, and lower toggle links, 28024 and 28030, are positioned within a portion of the expandable wellbore casing 100 that has not been radially expanded and plastically deformed by the system 10.

In an exemplary embodiment, as illustrated in FIGS. 16Z1 to 16Z4, 16AA1 to 16AA4, 16AB1 to 16AB4, 16AC1 to 16AC4, 16AD, and 16AE, the tubular spring housing 28034 of the adjustable bell section expansion cone assembly 28 defines internal annular recesses 28034*k* and 28034*l*, spaced apart by an internal flange 28034*m*, the tubular toggle bushing 28008 defines an external annular recess 28008*ac*, and the adjustable bell section expansion cone assembly further includes pins, 28100*a* and 28100*b* and 28102*a* and 28102*b*, mounted in holes 28008*j* and 280080 and 28008*k* and 28008*n*, respectively, of the tubular toggle bushing, and a one-shot deactivation device 28104 mounted on the tubular toggle bushing between the pins, 28100*a* and 28100*b* and 28102*a* and 28102*b*.

The one-shot deactivation device 28104 includes a tubular body 28104*a* that defines radial holes, 28104*b* and 28014*c*, and includes an external annular recess 28104*d* at one end, a centrally positioned external flange 28104*e*, a centrally positioned internal annular recess 28104*f*, and an external annular recess 28104*g* at another end. An engagement member 28106 that includes a base member 28106*a* having a tapered end 28106*b* and a key member 28106*c* having a tapered end 28106*d* is received within a portion of the internal annular recess 28104*f* of the tubular body 28104*a* and an engagement member 28108 that includes a base member 28108*a* having a tapered end 28108*b* and a key member 28108*c* having a tapered end 28108*d* is received within an opposite portion of the internal annular recess 28104*f* of the tubular body 28104*a*. Spring members, 28110 and 28112, are received within the annular recess 28104*f* of the tubular body 28104*a* for biasing the base members, base member 28106*a* and 28108*a*, of the engagement members, 28106 and 28108, respectively, radially inwardly relative to the tubular body 28104*a*.

In an exemplary embodiment, during operation of the adjustable bell section expansion cone assembly 28, as illustrated in FIGS. 16Z1 to 16Z4, the one-shot deactivation device 28104 are positioned proximate and in intimate contact with the pins, 28102*a* and 28102*b*, with the tapered ends, 28106*b* and 28108*b*, of the base members, 28106*a* and 28108*a*, of the engagement members, 28106 and 28108, received within the external annular recess 28008*ac* of the tubular toggle bushing 28008. When the one-shot deactivation device 28104 is positioned as illustrated in FIGS. 16Z1 to 16Z4, the external annular recess 28104*d* of the tubular body 28104*a* of the one-shot deactivation device is moved out of engagement with the engagement arms, 28026*d* and 28032*d*, of the triggers, 28026 and 28032, respectively. As a result, the triggers, 28026 and 28032, may operate normally as described above with reference to FIGS. 16W, 16X, and 16Y.

Figure 16A:
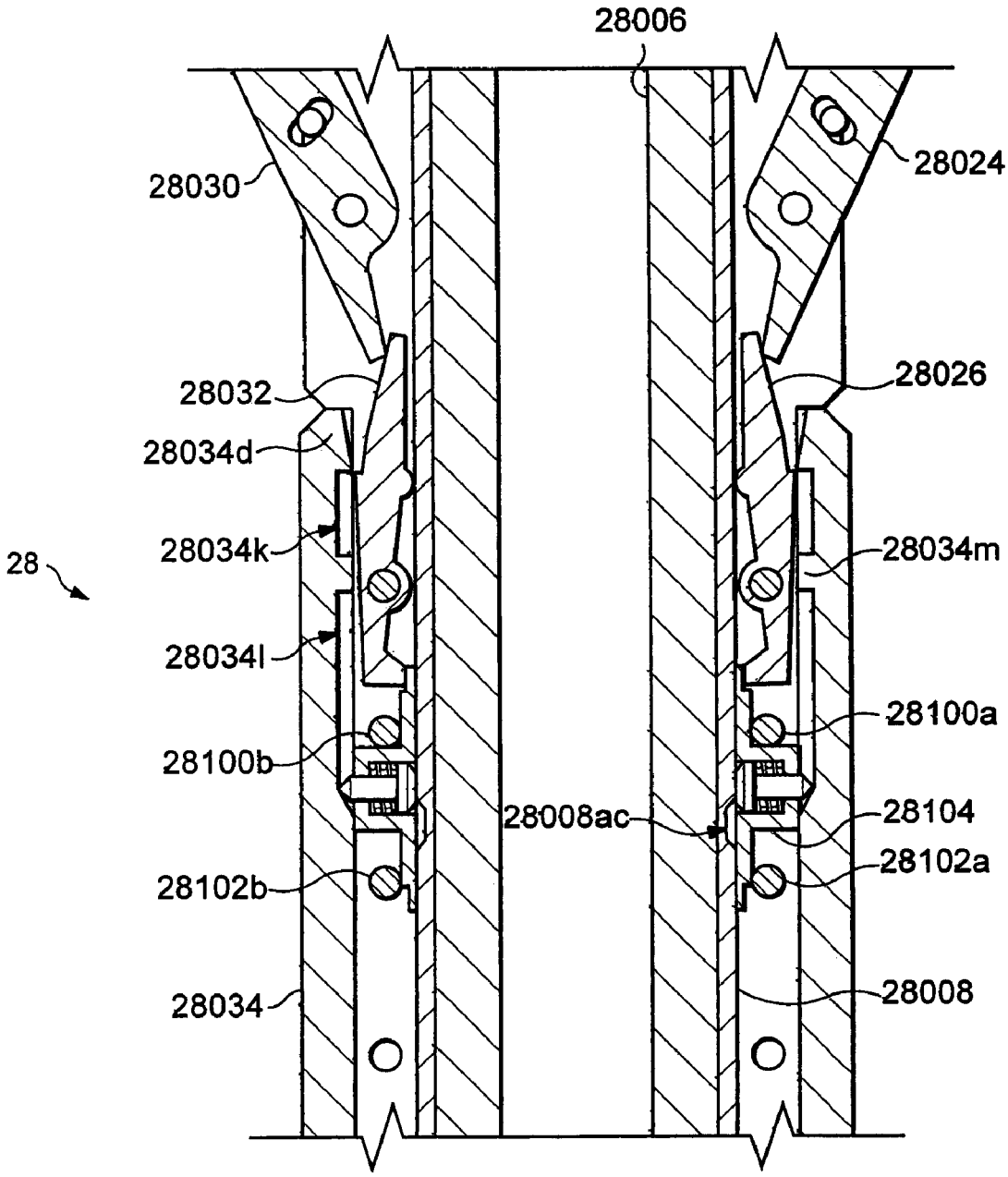
Figure 16A:
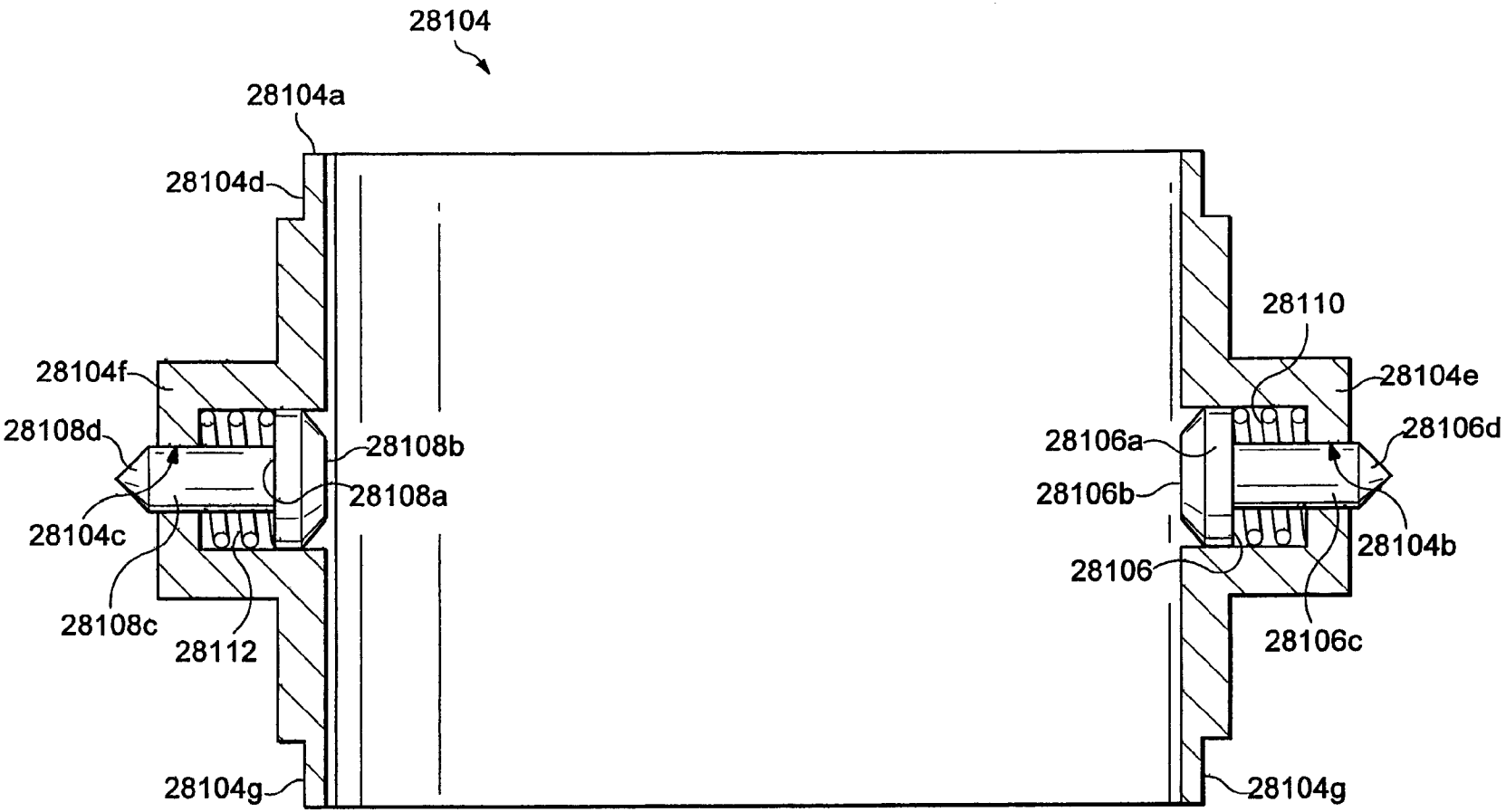

Conversely, in an exemplary embodiment, during operation of the adjustable bell section expansion cone assembly 28, as illustrated in FIGS. 16AA1 to 16AA4, the one-shot deactivation device 28104 are positioned proximate and in intimate contact with the pins, 28100*a* and 28100*b*, with the tapered ends, 28106*b* and 28108*b*, of the base members, 28106*a* and 28108*a*, of the engagement members, 28106 and 28108, not received within the external annular recess 28008*ac* of the tubular toggle bushing 28008. When the one-shot deactivation device 28104 is positioned as illustrated in FIG. 16AA, the external annular recess 28104*d* of the tubular body 28104*a* of the one-shot deactivation device is moved into engagement with the engagement arms, 28026*d* and 28032*d*, of the triggers, 28026 and 28032, respectively. As a result, the triggers, 28026 and 28032, are deactivated and may not operate normally as described above with reference to FIGS. 16W, 16X, and 16Y.

In an alternative embodiment, the elements of the adjustable bell section expansion cone assembly 28 that sense the diameter of the expandable wellbore casing 100 may be disabled or omitted or adjusted to sense any pre-selected internal diameter of the expandable wellbore casing.

In an exemplary embodiment, the adjustable casing expansion cone assembly 30 operates and is provided substantially, at least in part, as disclosed in one or more of the following: (1) PCT patent application Ser. No. PCT/US02/36157, filed on Nov. 12, 2002, and/or (2) PCT patent application Ser. No. PCT/US02/36267, filed on Nov. 12, 2002, and/or (3) PCT patent application Ser. No. PCT/US03/04837, filed on Feb. 29, 2003, and/or (4) PCT patent application Ser. No. PCT/US03/29859, docket no. 25791.102.02, filed on Sep. 22, 2003, and/or (5) PCT patent application Ser. No. PCT/US03/14153, filed on Nov. 13, 2003, and/or (6) PCT patent application Ser. No. PCT/US03/18530, filed on Jun. 11, 2003, and/or (7) PCT patent application Ser. No. PCT/US04/07711, filed on Mar. 11, 2004, and/or (8) PCT patent application Ser. No. PCT/US04/009434, filed on Mar. 26, 2004, and/or (9) PCT patent application Ser. No. PCT/US04/010317, filed on Apr. 2, 2004, and/or (10) PCT patent application Ser. No. PCT/US04/010712, filed on Apr. 7, 2004, and/or (10) PCT patent application Ser. No. PCT/US04/010762, filed on Apr. 6, 2004, and/or PCT application Ser. No. PCT/US04/011973, filed on Apr. 15, 2004, the disclosures of which are incorporated herein by reference.

In an exemplary embodiment, as illustrated in FIGS. 17-1 and 17-2, 17A1 to 17A2, 17B1 to 17B2, 17C, 17D, 17E, 17F, 17G, 17H, 171, 17*j*, 17K, 17L, 17M, 17N, 17O, 17P, 17R, 17S, 17T, 17U, 17V, 17W, 17X, 17Y, 17Z1-17Z4, 17AA1 to 17AA4, 17AB1 to 17AB4, 17AC1 to 17AC4, 17AD, and 17AE, the adjustable casing expansion cone assembly 30 includes an upper tubular tool joint 30002 that defines a longitudinal passage 30002*a* and mounting holes, 30002*b* and 30002*c*, and includes an internal threaded connection 30002*d*, an inner annular recess 30002*e*, an inner annular recess 30002*f*, and an internal threaded connection 30002*g*. A tubular torque plate 30004 that defines a longitudinal passage 30004*a* and includes circumferentially spaced apart teeth 30004*b* is received within, mates with, and is coupled to the internal annular recess 30002*e* of the upper tubular tool joint 30002.

Circumferentially spaced apart teeth 30006*a* of an end of a tubular lower mandrel 30006 that defines a longitudinal passage 30006*b*, a radial passage 30006*ba*, and a radial passage 30006*bb* and includes an external threaded connection 30006*c*, an external flange 30006*d*, an external annular recess 30006*e* having a step 30006*f* at one end, an external annular recess 30006*g*, external teeth 30006*h*, an external threaded connection 30006*i*, and an external annular recess 30006*j* engage the circumferentially spaced apart teeth 30004*b* of the tubular torque plate 30004. An internal threaded connection 30008*a* of an end of a tubular toggle bushing 30008 that defines a longitudinal passage 30008*b*, an upper longitudinal slot 30008*c*, a lower longitudinal slot 30008*d*, mounting holes, 30008*e*, 30008*f*, 30008*g*, 30008*h*, 30008*i*, 30008*j*, 30008*k*, 30008*l*, 30008*m*, 30008*n*, 30008*o*, 30008*p*, 30008*q* , 30008*r*, 30008*s*, 30008*t*, 30008*u*, 30008*v*, 30008*w*, 30008*x*, 30008*xa*, and 30008*xb*, and includes an external annular recess 30008*y* , internal annular recess 30008*z*, external annular recess 30008*aa*, and an external annular recess 30008*ab* receives and is coupled to the external threaded connection 30006*c* of the tubular lower mandrel 30006.

A sealing element 30010 is received within the external annular recess 30008*y* of the tubular toggle bushing 30008 for sealing the interface between the tubular toggle bushing and the upper tubular tool joint 30002. A sealing element 30012 is received within the internal annular recess 30008*z* of the tubular toggle bushing 30008 for sealing the interface between the tubular toggle bushing and the tubular lower mandrel 30006.

Mounting screws, 30014*a* and 30014*b*, mounted within and coupled to the mounting holes, 30008*w* and 30008*x*, respectively, of the tubular toggle bushing 30008 are also received within the mounting holes, 30002*b* and 30002*c*, of the upper tubular tool joint 30002. Mounting pins, 30016*a*, 30016*b*, 30016*c*, 30016*d*, and 30016*e*, are mounted within the mounting holes, 30008*e*, 30008*f*, 30008*g*, 30008*h*, and 30008*i*, respectively. Mounting pins, 30018*a*, 30018*b*, 30018*c*, 30018*d*, and 30018*e*, are mounted within the mounting holes, 30008*t*, 30008*s*, 30008*r*, 30008*q*, and 30008*p*, respectively. Mounting screws, 30020*a* and 30020*b*, are mounted within the mounting holes, 30008*u* and 30008*v*, respectively.

A first upper toggle link 30022 defines mounting holes, 30022*a* and 30022*b*, for receiving the mounting pins, 30016*a* and 30016*b*, and includes a mounting pin 30022*c* at one end. A first lower toggle link 30024 defines mounting holes, 30024*a*, 30024*b*, and 30024*c*, for receiving the mounting pins, 30022*c*, 30016*c*, and 30016*d*, respectively and includes an engagement arm 30024*d*. A first trigger 30026 defines a mounting hole 30026*a* for receiving the mounting pin 30016*e* and includes an engagement arm 30026*b* at one end, an engagement member 30026*c*, and an engagement arm 30026*d* at another end.

A second upper toggle link 30028 defines mounting holes, 30028*a* and 30028*b*, for receiving the mounting pins, 30018*a* and 30018*b*, and includes a mounting pin 30028*c* at one end. A second lower toggle link 30030 defines mounting holes, 30030*a*, 30030*b*, and 30030*c*, for receiving the mounting pins, 30028*c*, 30018*c*, and 30018*d*, respectively and includes an engagement arm 30030*d*. A second trigger 30032 defines a mounting hole 30032*a* for receiving the mounting pin 30018*e* and includes an engagement arm 30032*b* at one end, an engagement member 30032*c*, and an engagement arm 30032*d* at another end.

An end of a tubular spring housing 30034 that defines a longitudinal passage 30034*a*, mounting holes, 30034*b* and 30034*c*, and mounting holes, 30034*ba* and 30034*ca*,and includes an internal flange 30034*d* and an internal annular recess 30034*e* at one end, and an internal flange 30034*f*, an internal annular recess 30034*g*, an internal annular recess 30034*h*, and an external threaded connection 30034*i* at another end receives and mates with the end of the tubular toggle bushing 30008. Mounting screws, 30035*a* and 30035*b*, are mounted within and coupled to the mounting holes, 30008*xb* and 30008*xa*, respectively, of the tubular toggle bushing 30008 and are received within the mounting holes, 30034*ba* and 30034*ca*,respectively, of the tubular spring housing 30034.

A tubular retracting spring ring 30036 that defines mounting holes, 30036*a* and 30036*b*, receives and mates with a portion of the tubular lower mandrel 30006 and is received within and mates with a portion of the tubular spring housing 30034. Mounting screws, 30038*a* and 30038*b*, are mounted within and coupled to the mounting holes, 30036*a* and 30036*b*, respectively, of the tubular retracting spring ring 30036 and extend into the mounting holes, 30034*b* and 30034*c*, respectively, of the tubular spring housing 30034.

Casing diameter sensor springs, 30040*a* and 30040*b*, are positioned within the longitudinal slots, 30008*c* and 3008*d*, respectively, of the tubular toggle bushing 30008 that engage the engagement members, 30026*c* and 30032*c*, and engagement arms,30026*d* and 30032*d*, of the first and second triggers, 30026 and 30032, respectively. An inner flange 30042*a* of an end of a tubular spring washer 30042 mates with and receives a portion of the tubular lower mandrel 30006 and an end face of the inner flange of the tubular spring washer is positioned proximate and end face of the external flange 30006*d* of the tubular lower mandrel. The tubular spring washer 30042 is further received within the longitudinal passage 30034*a* of the tubular spring housing 30034.

An end of a retracting spring 30044 that receives the tubular lower mandrel 30006 is positioned within the tubular spring washer 30042 in contact with the internal flange 30042*a* of the tubular spring washer and the other end of the retracting spring is positioned in contact with an end face of the tubular retracting spring ring 30036.

A sealing element 30046 is received within the external annular recess 30006*j* of the tubular lower mandrel 30006 for sealing the interface between the tubular lower mandrel and the tubular spring housing 30034. A sealing element 30048 is received within the internal annular recess 30034*h* of the tubular spring housing 30034 for sealing the interface between the tubular spring housing and the tubular lower mandrel 30006.

An internal threaded connection 30050*a* of an end of a tubular upper hinge sleeve 30050 that includes an internal flange 30050*b* and an internal pivot 30050*c* receives and is coupled to the external threaded connection 30034*i* of the end of the tubular spring housing 30034.

An external flange 30052*a* of a base member 30052*b* of an upper cam assembly 30052, that is mounted upon and receives the lower tubular mandrel 30006, that includes an internal flange 30052*c* that is received within the external annular recess 30006*e* of the lower tubular mandrel 30006 and a plurality of circumferentially spaced apart tapered cam arms 30052*d* extending from the base member mates with and is received within the tubular upper hinge sleeve 30050. The base member 30052*b* of the upper cam assembly 30052 further includes a plurality of circumferentially spaced apart teeth 30052*f* that mate with and are received within a plurality of circumferentially spaced apart teeth 30034*j* provided on the end face of the tubular spring housing 30034 and an end face of the external flange 30052*a* of the base member of the upper cam assembly is positioned in opposing relation to an end face of the internal flange 30050*b* of the tubular upper hinge sleeve 30050. Each of the cam arms 30052*d* of the upper cam assembly 30052 include external cam surfaces 30052*e*. In an exemplary embodiment, the teeth 30052*f* of the base member 30052*b* of the upper cam assembly 30052 and the teeth 30034*j* provided on the end face of the tubular spring housing 30034 permit torsional loads to be transmitted between the tubular spring housing and the upper cam assembly.

A plurality of circumferentially spaced apart upper expansion segments 30054 are mounted upon and receive the lower tubular mandrel 30006 and each include an external pivot recess 30054*a* at one end for mating with and receiving the internal pivot 30050*c* of the tubular upper hinge sleeve 30050 and an external tapered expansion surface 30054*b* at another end and are pivotally mounted within the tubular upper hinge sleeve and are interleaved with the circumferentially spaced apart cam arms 30052*d* of the upper cam assembly 30052. The upper expansion segments 30054 are interleaved among the cam arms 30052*d* of the upper cam assembly 30052.

A plurality of circumferentially spaced apart lower expansion segments 30058 are mounted upon and receive the lower tubular mandrel 30006, are interleaved among the upper expansion segments 30054, are oriented in the opposite direction to the upper expansion segments 30054, each include an external pivot recess 30058*a* at one end and an external tapered expansion surface 30054*b* at another end and are positioned in opposing relation to corresponding circumferentially spaced apart cam arms 30052*d* of the upper cam assembly 30052.

A lower cam assembly 30060 is mounted upon and receives the lower tubular mandrel 30006 that includes a base member 30060*a* having an external flange 30060*b*, a plurality of circumferentially spaced apart cam arms 30060*d* that extend from the base member that each include external cam surfaces 30060*e* and define mounting holes 30060*f* and 30060*g*. The base member 30060*a* of the lower cam assembly 30060 further includes a plurality of circumferentially spaced apart teeth 30060*h*. The circumferentially spaced apart cam arms 30060*d* of the lower cam assembly 30060 are interleaved among the lower expansion segments 30058 and the circumferentially spaced apart cam arms 30052*d* of the upper cam assembly 30052 and positioned in opposing relation to corresponding upper expansion segments 30054.

Mounting screws, 30062*a*, 30062*b*, 30062*c*, and 30062*e*, are mounted within the corresponding mounting holes, 30060*f* and 30060*g*, of the lower cam assembly 30060 and are received within the external annular recess 30006*g* of the lower cam assembly 30060.

A tubular lower hinge sleeve 30064 that receives the lower expansion segments 30058 and the lower cam assembly 30060 includes an internal flange 30064*a* for engaging the external flange 30060*b* of the base member of the lower cam assembly 30060, an internal pivot 30064*b* for engaging and receiving the external pivot recess 30058*a* of the lower expansion segments 30058 thereby pivotally mounting the lower expansion segments within the tubular lower hinge sleeve, and an internal threaded connection 30064*c*.

An external threaded connection 30066*a* of an end of a tubular sleeve 30066 that defines mounting holes, 30066*b* and 30066*c*, and includes an internal annular recess 30066*d* having a shoulder 30066*e*, an internal flange 30066*f*, and an internal threaded connection 30066*g* at another end is received within and coupled to the internal threaded connection 30064*c* of the tubular lower hinge sleeve 30064. An external threaded connection 30068*a* of an end of a tubular member 30068 that defines a longitudinal passage 30068*b* and mounting holes, 30068*c* and 30068*d*, and includes an external annular recess 30068*e*, and an external threaded connection 30068*f* at another end is received within and is coupled to the internal threaded connection 30066*g* of the tubular sleeve 30066.

Mounting screws, 30070*a* and 30070*b*, are mounted in and coupled to the mounting holes, 30068*c* and 30068*d*, respectively, of the tubular member 30068 that also extend into the mounting holes, 30066*b* and 30066*c*, respectively, of the tubular sleeve 30066. A sealing element 30072 is received within the external annular recess 30068*e* of the tubular member 30068 for sealing the interface between the tubular member and the tubular sleeve 30066.

An internal threaded connection 30074*a* of a tubular retracting piston 30074 that defines a longitudinal passage 30074*b* and includes an internal annular recess 30074*c* and an external annular recess 30074*d* receives and is coupled to the external threaded connection 30006*i* of the tubular lower mandrel 30006. A sealing element 30076 is received within the external annular recess 30074*d* of the tubular retracting piston 30074 for sealing the interface between the tubular retracting piston and the tubular sleeve 30066. A sealing element 30078 is received within the internal annular recess 30074*c* of the tubular retracting piston 30074 for sealing the interface between the tubular retracting piston and the tubular lower mandrel 30006.

Locking dogs 30080 mate with and receive the external teeth 30006*h* of the tubular lower mandrel 30006. A spacer ring 30082 is positioned between an end face of the locking dogs 30080 and an end face of the lower cam assembly 30060. A release piston 30084 mounted upon the tubular lower mandrel 30006 defines a radial passage 30084*a* for mounting a burst disk 30086 includes sealing elements, 30084*b*, 30084*c*, and 30084*d*. The sealing elements, 30084*b* and 30084*d*, sealing the interface between the release piston 30084 and the tubular lower mandrel 30006. An end face of the release piston 30084 is positioned in opposing relation to an end face of the locking dogs 30080.

A release sleeve 30088 that receives and is mounted upon the locking dogs 30080 and the release piston 30084 includes an internal flange 30088*a* at one end that sealingly engages the tubular lower mandrel 30006. A bypass sleeve 30090 that receives and is mounted upon the release sleeve 30088 includes an internal flange 30090*a* at one end.

In an exemplary embodiment, during operation of the adjustable casing expansion cone assembly 30, the retracting spring 30044 is compressed and thereby applies a biasing spring force in a direction 30092 from the lower tubular mandrel 30006 to the tubular spring housing 30034 that, in the absence of other forces, moves and/or maintains the upper cam assembly 30052 and the upper expansion segments 30054 out of engagement with the lower expansion segments 30058 and the lower cam assembly 30060. In an exemplary embodiment, during operation of the adjustable bell section expansion cone assembly 28, an external threaded connection 20*a* of an end of the sealing cup assembly 20 is coupled to the internal threaded connection 30002*d* of the upper tubular tool joint 30002 and an internal threaded connection 30*a* of an end of the adjustable casing expansion cone assembly 30 is coupled to the external threaded connection 30068*f* of the tubular member 30068.

The upper cam assembly 30052 and the upper expansion segments 30054 may be brought into engagement with the lower expansion segments 30058 and the lower cam assembly 30060 by pressurizing an annulus 30094 defined between the lower tubular mandrel 30006 and the tubular spring housing 30034. In particular, injection of fluidic materials into the adjustable casing expansion cone assembly 30 through the longitudinal passage 30006*b* of the lower tubular mandrel 30006 and into the radial passage 30006*ba* may pressurize the annulus 30094 thereby creating sufficient operating pressure to generate a force in a direction 30096 sufficient to overcome the biasing force of the retracting spring 30044. As a result, the spring housing 30034 may be displaced in the direction 30096 relative to the lower tubular mandrel 30006 thereby displacing the tubular upper hinge sleeve 30050, upper cam assembly 30052 , and upper expansion segments 30054 in the direction 30096.

Figures 1, 17:
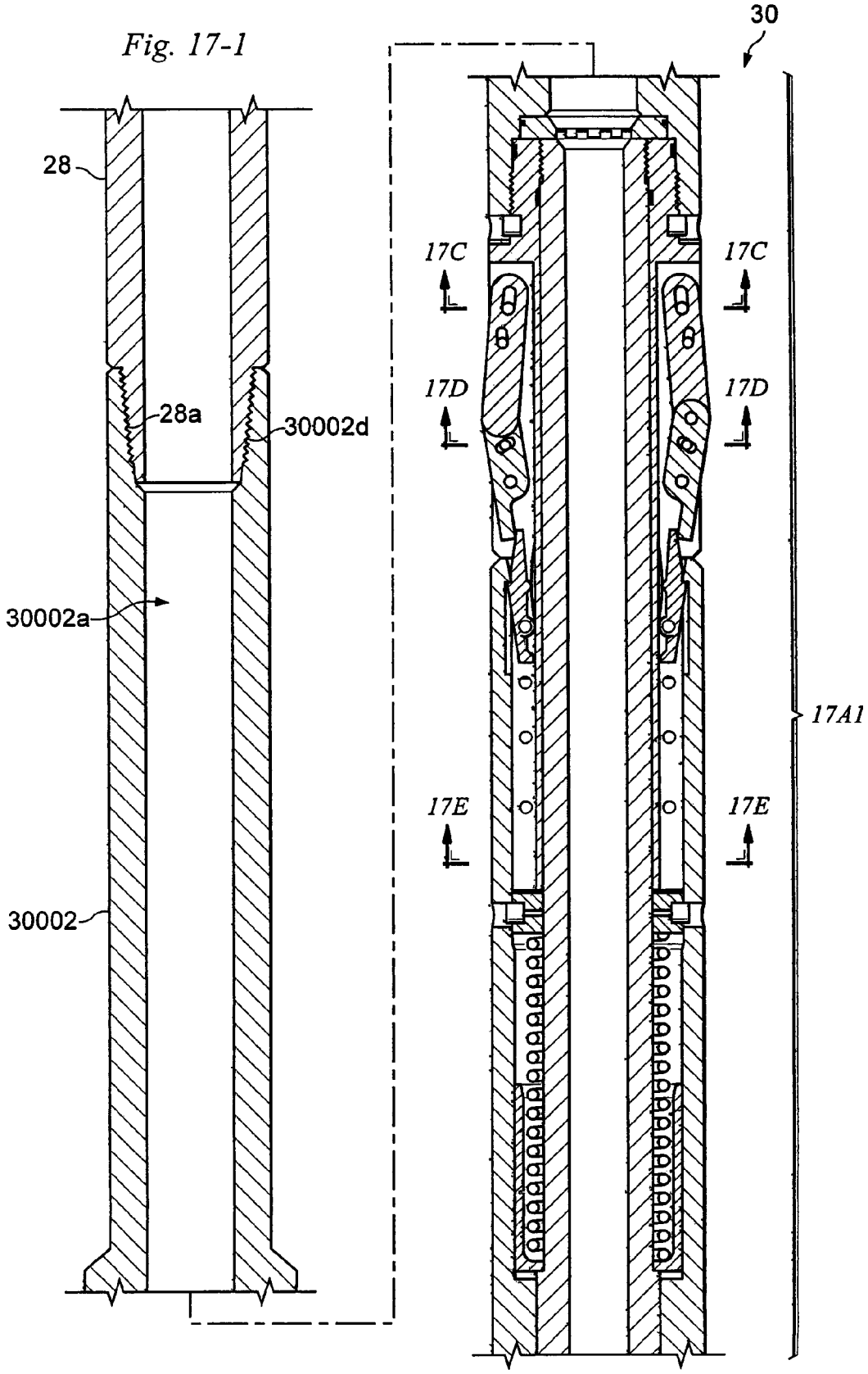
Figures 2, 17:
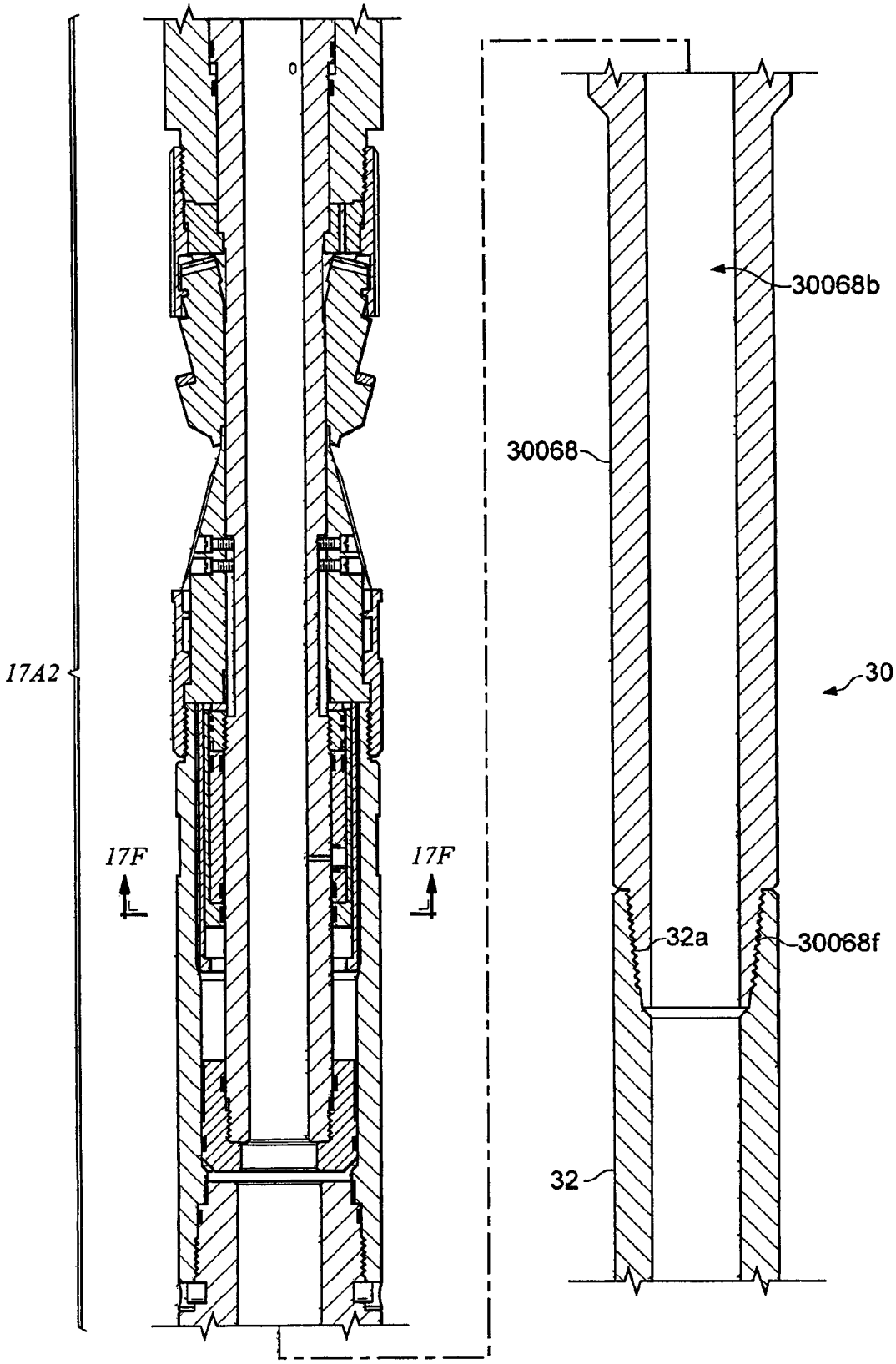
Figure 17C:
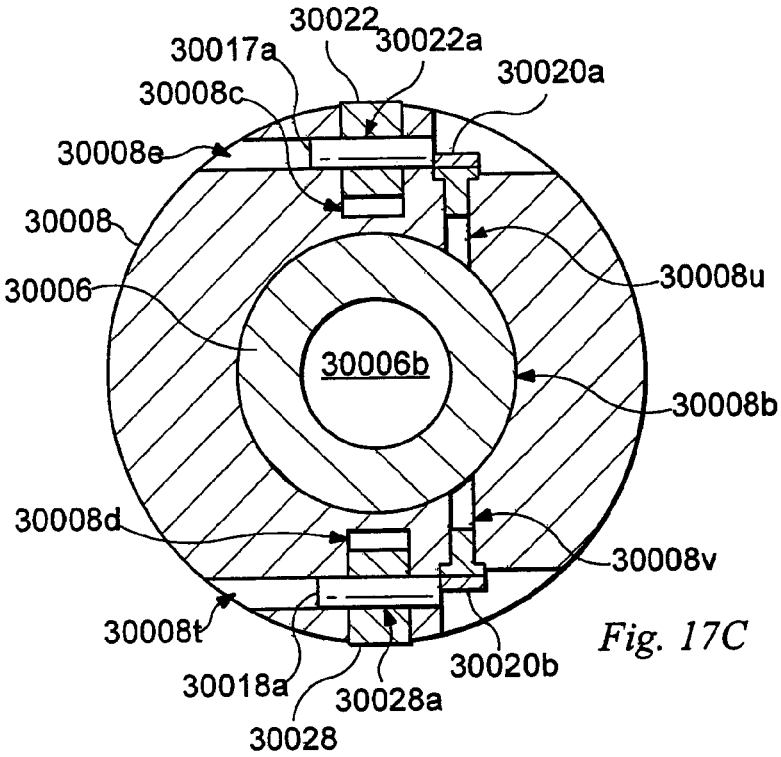
Figure 17D:
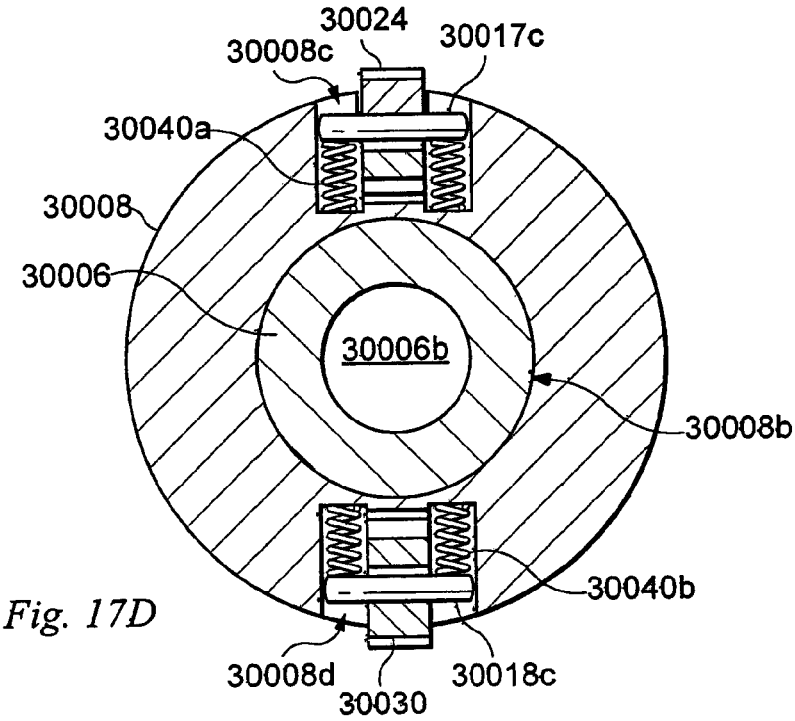
Figure 17E:
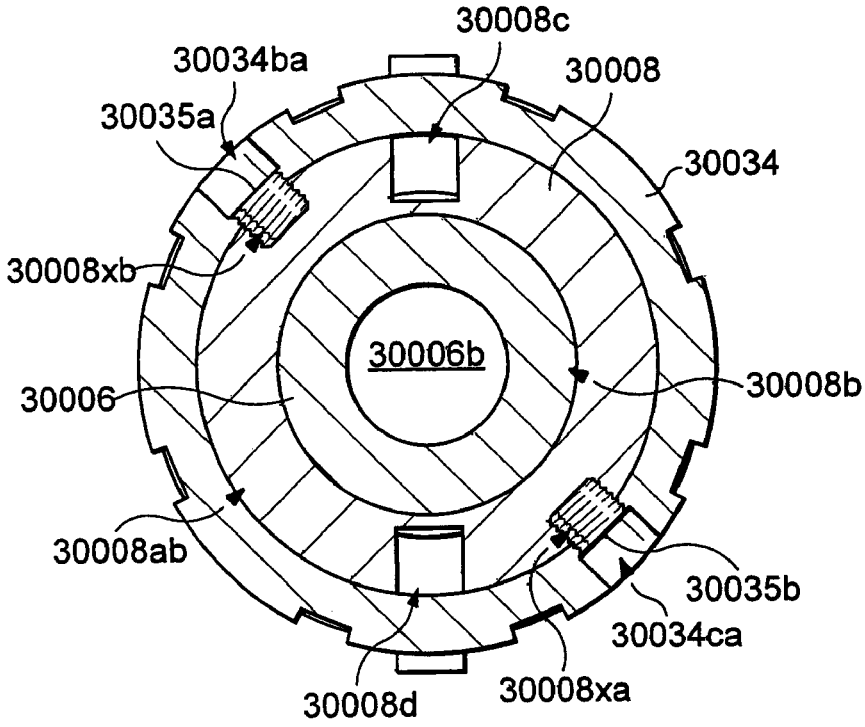
Figure 17F:
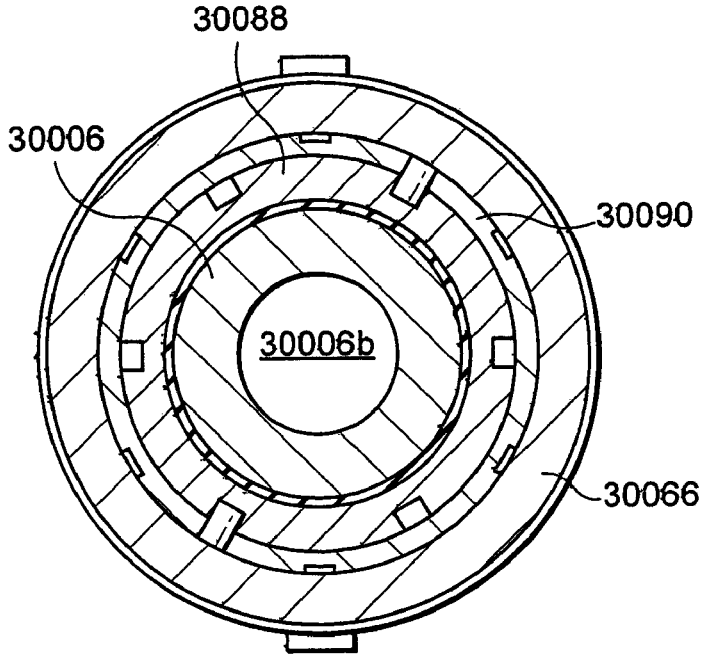
Figure 17G:
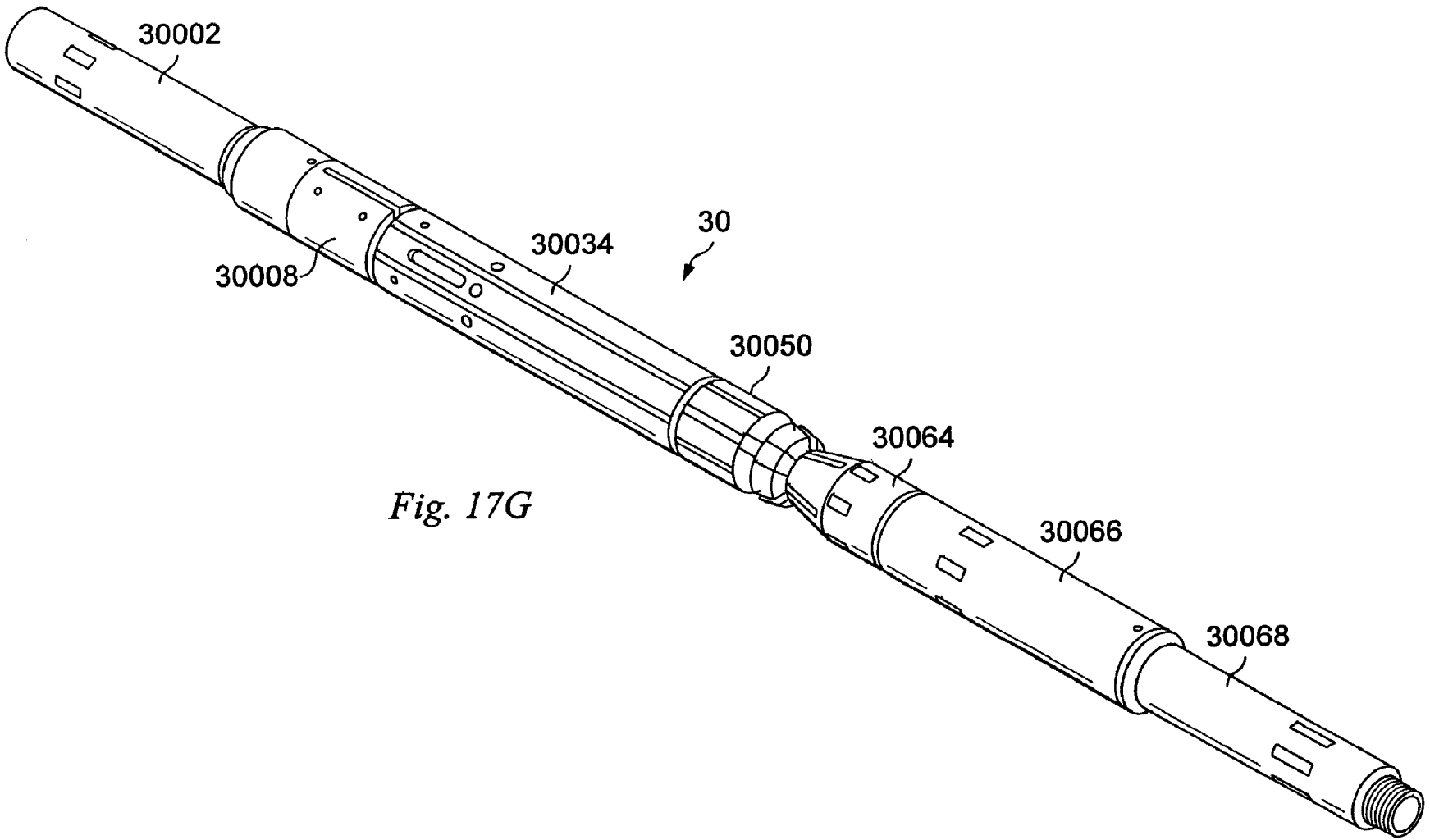
Figure 17H:
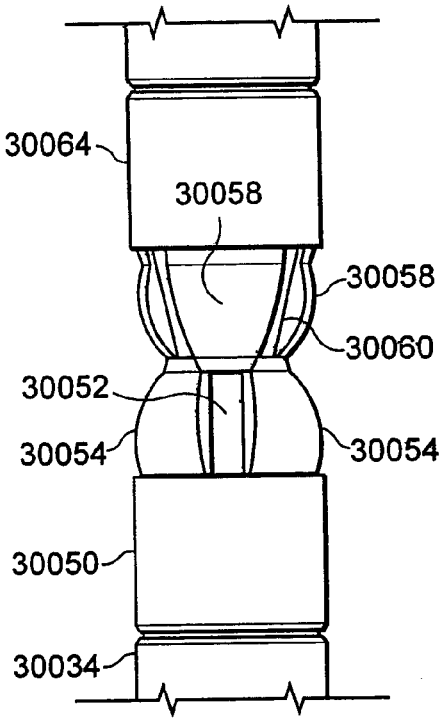
Figure 17I:
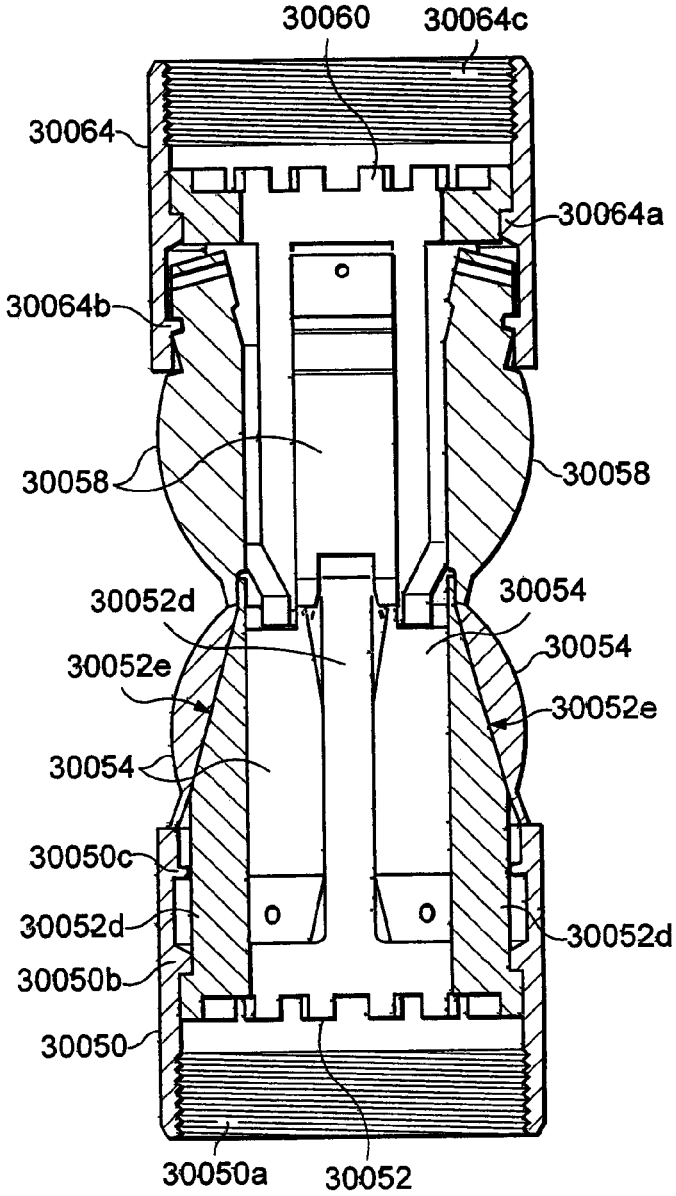
Figure 17J:
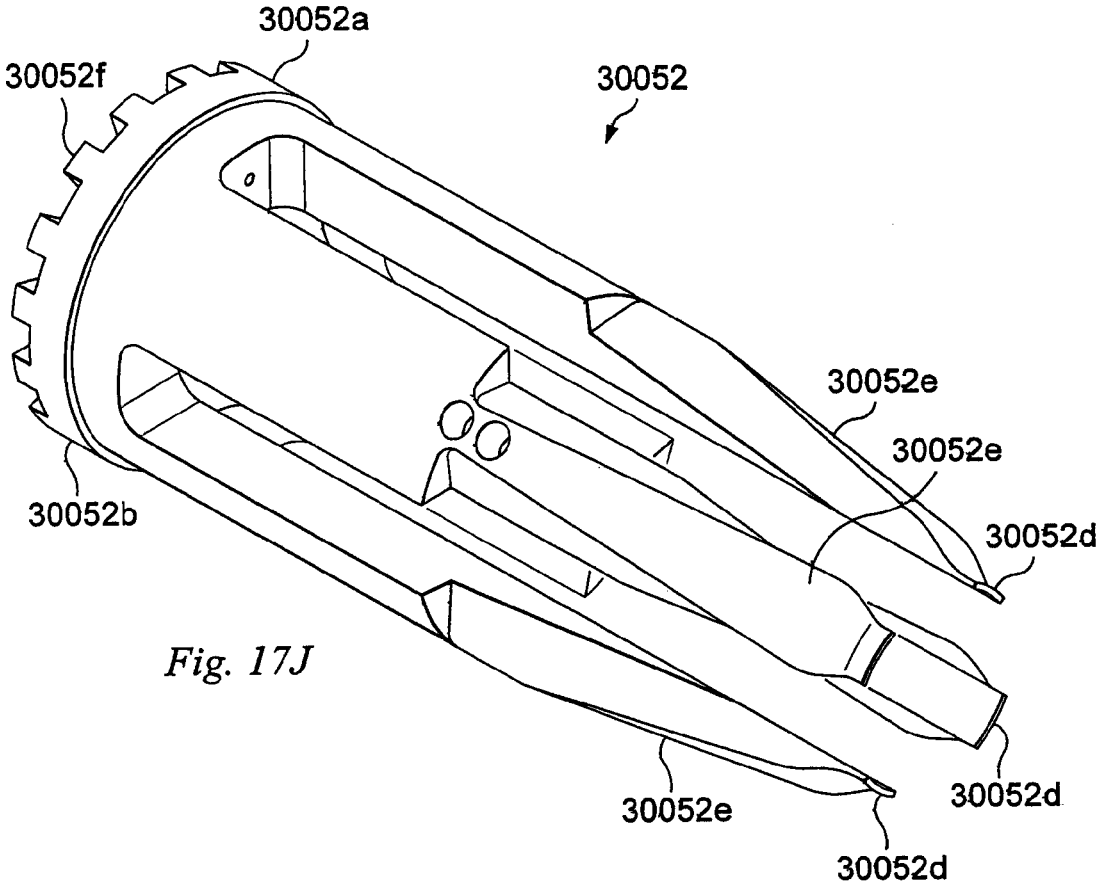
Figure 17K:
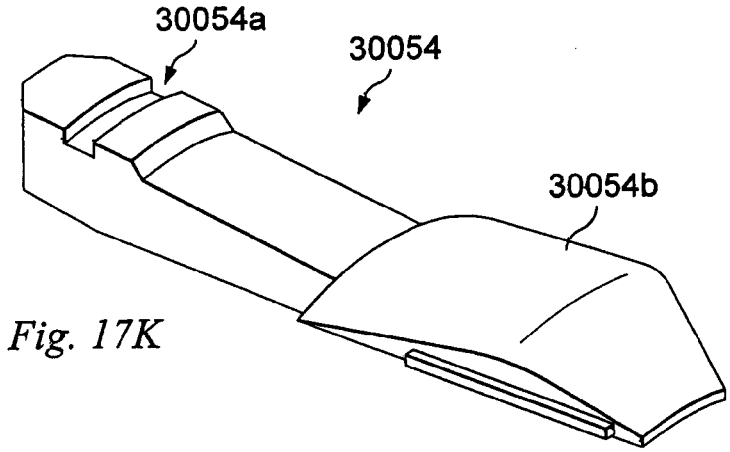
Figure 17L:
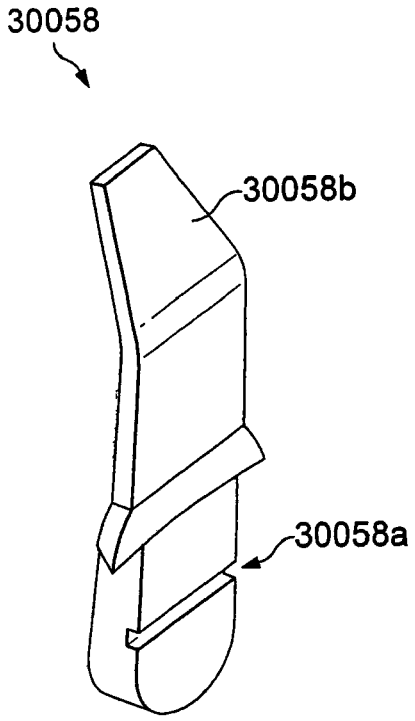
Figure 17M:
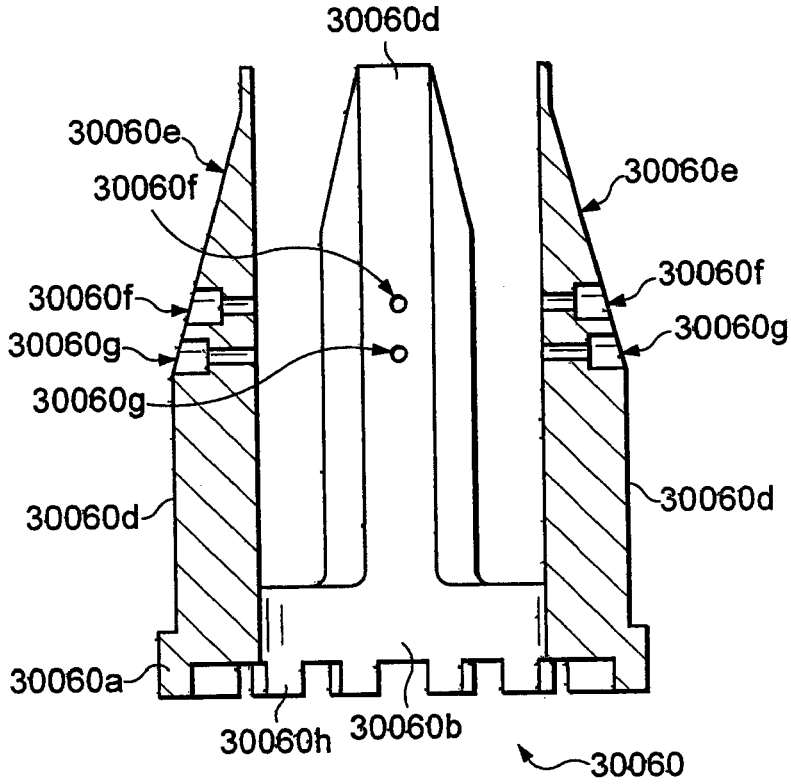
Figure 17N:
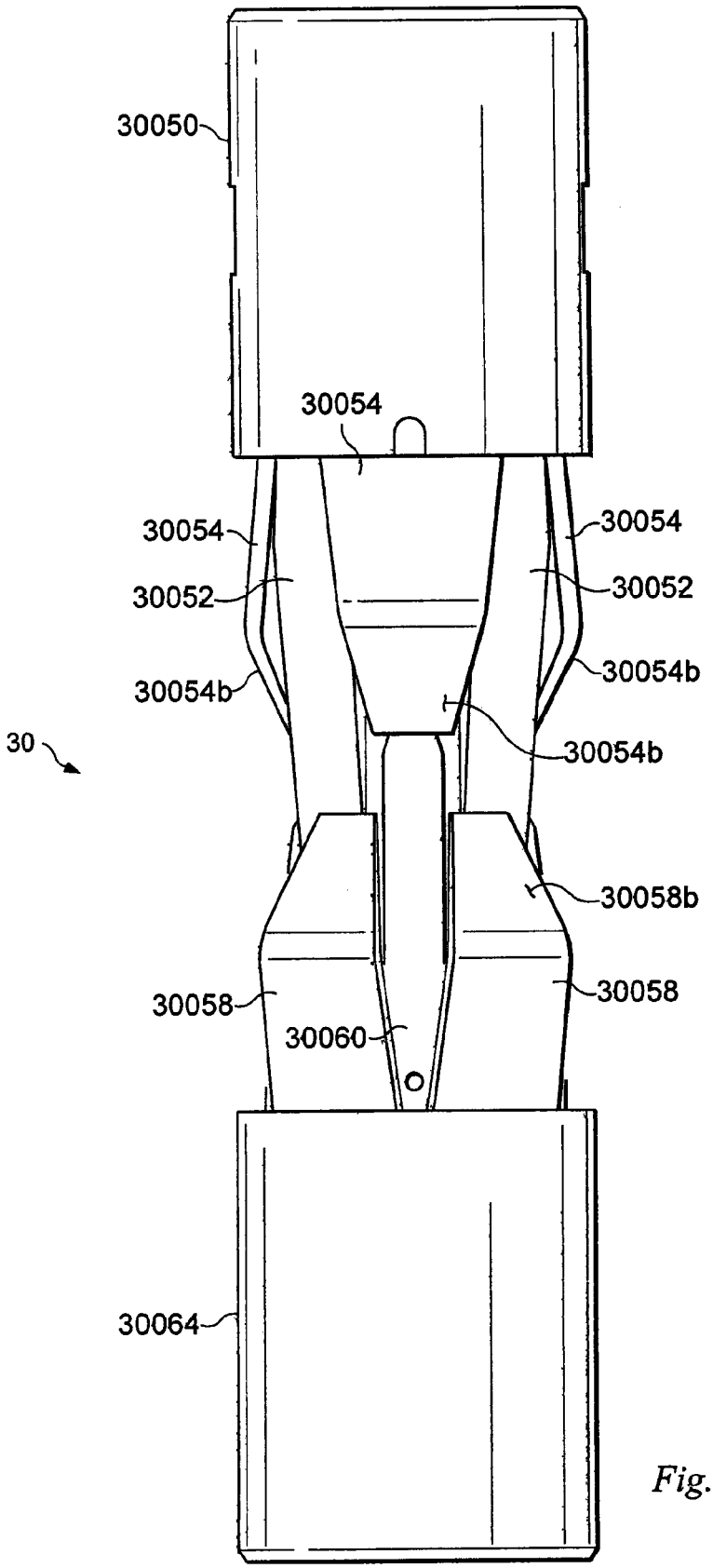
Figure 17O:
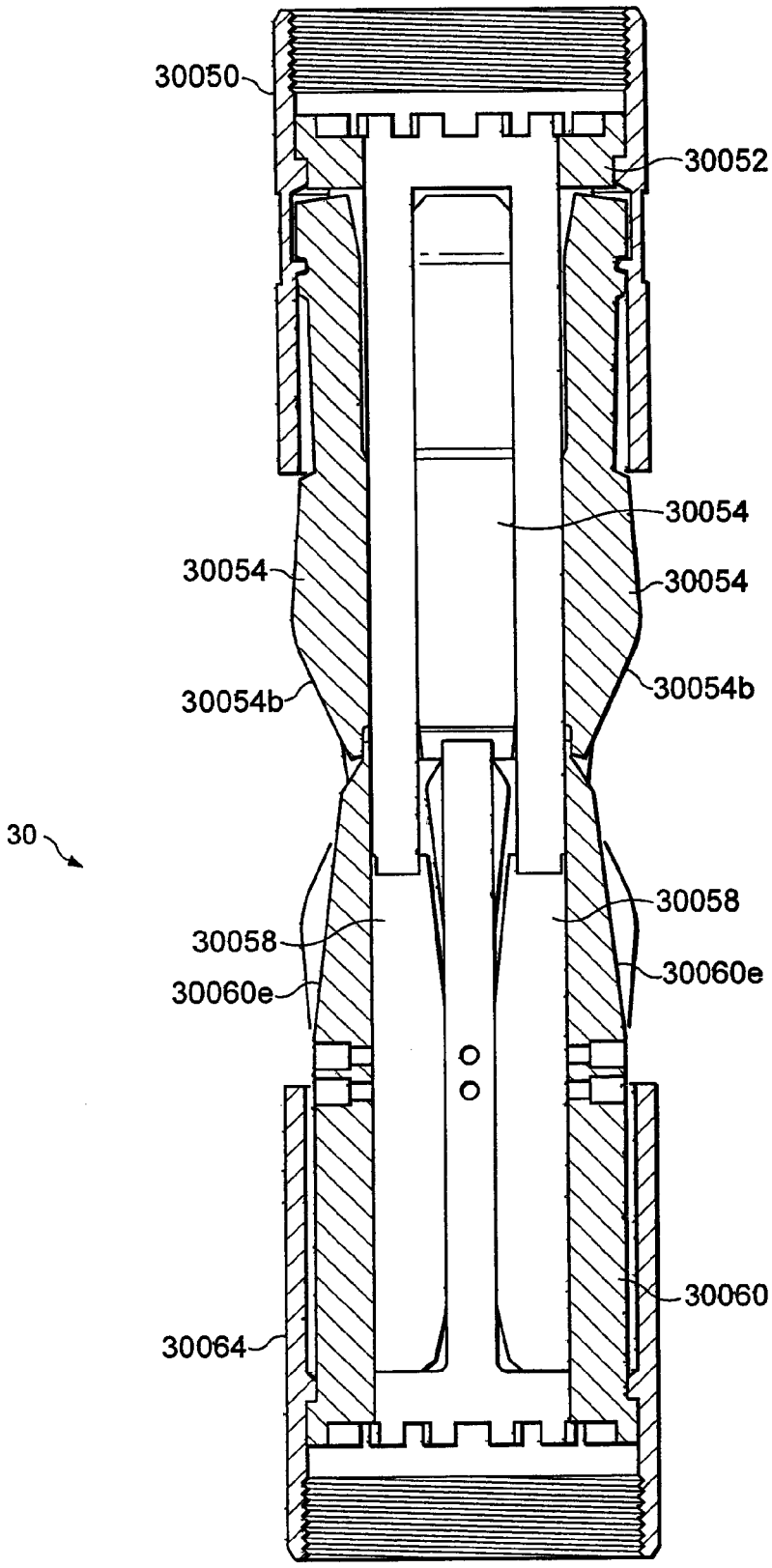
Figure 17P:
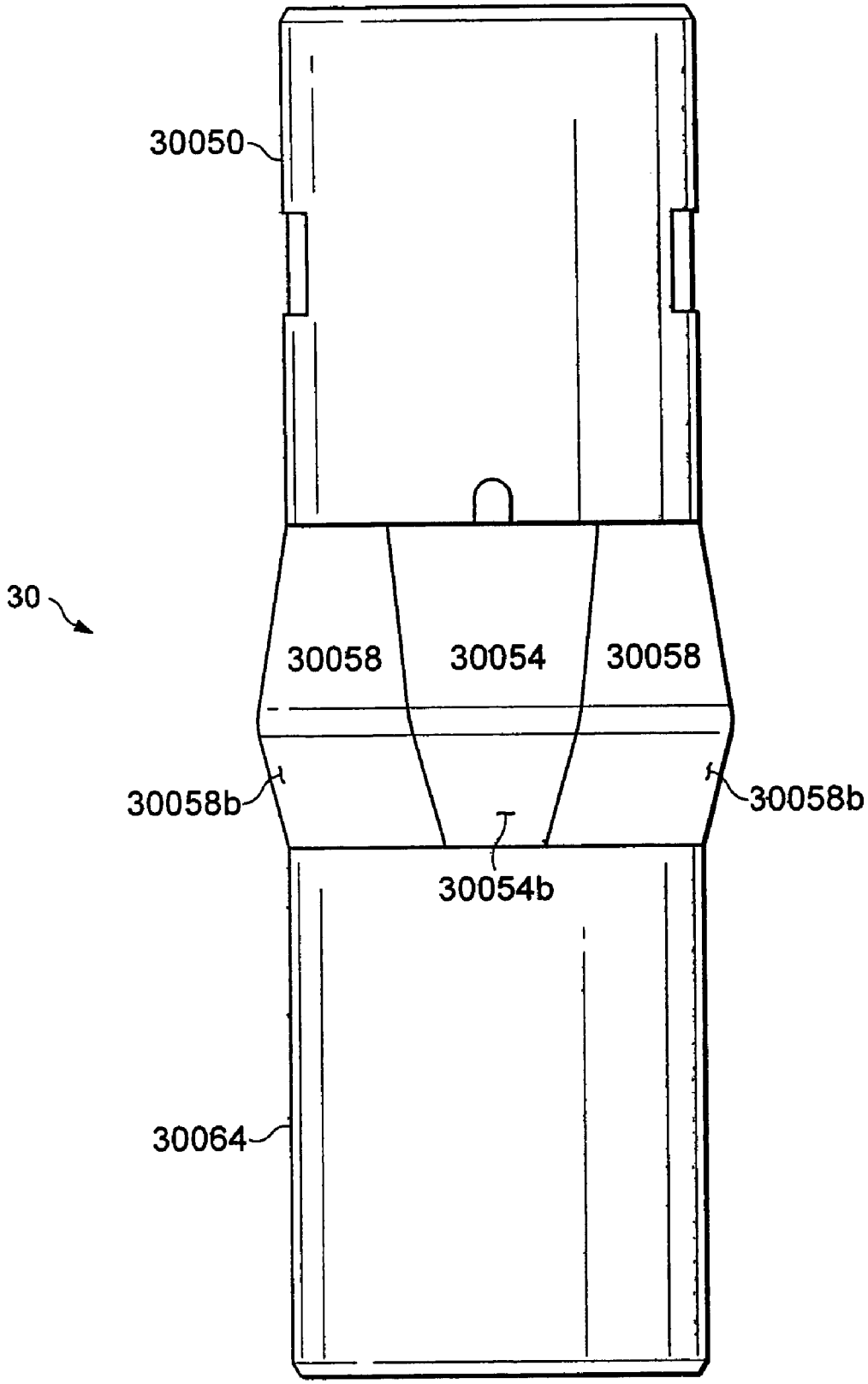
Figure 17R:
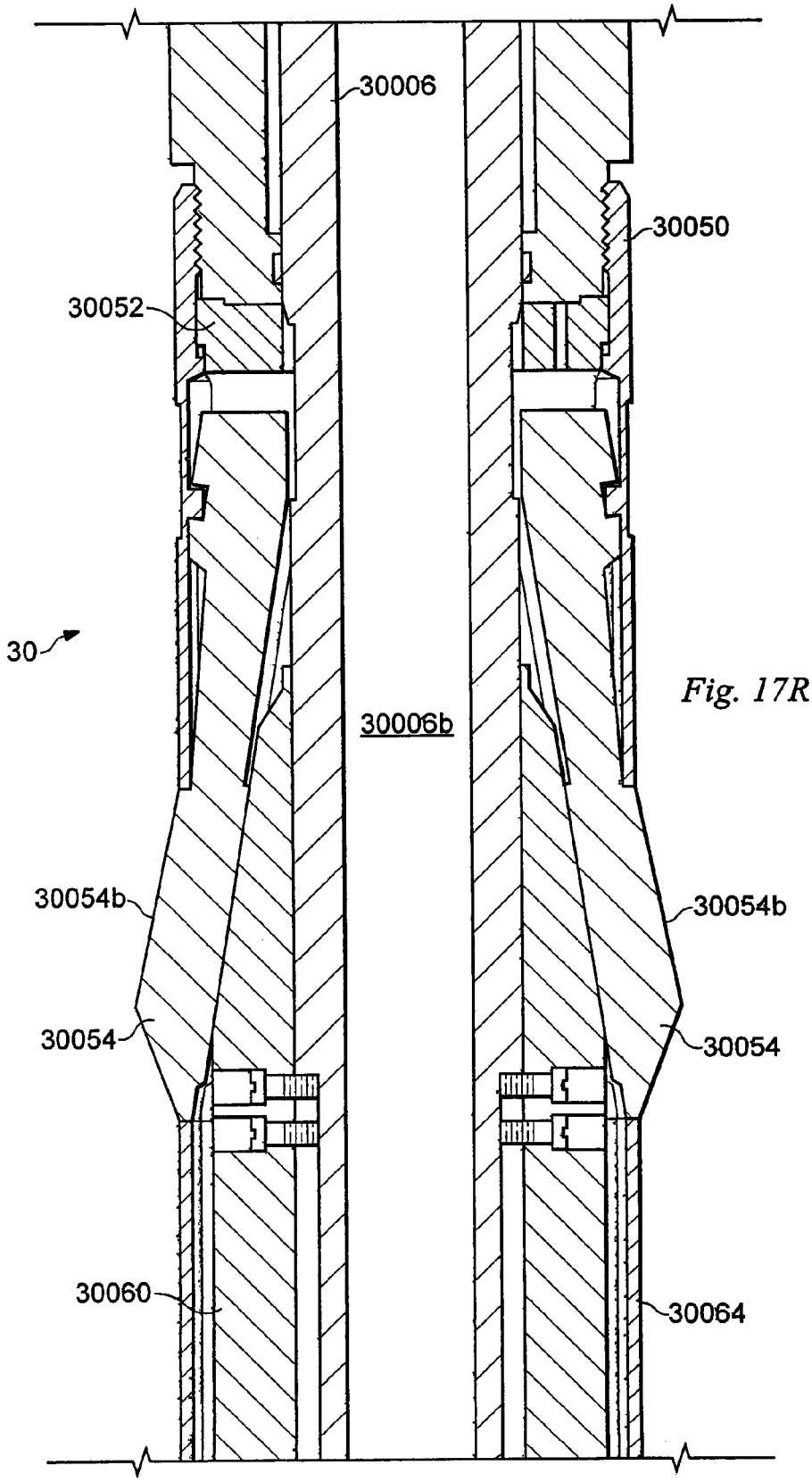
Figure 17S:
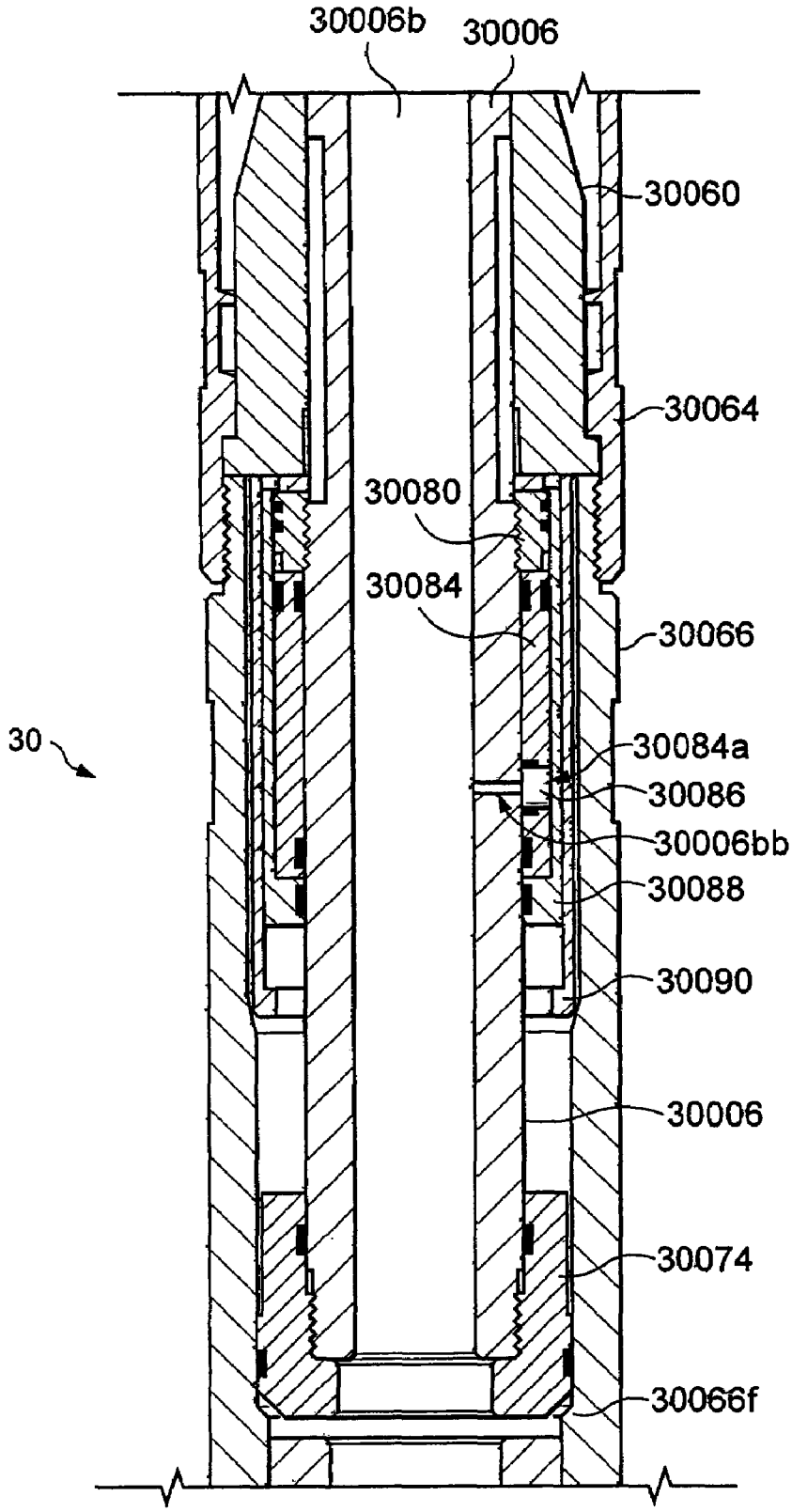

In an exemplary embodiment, as illustrated in FIGS. 17P, 17Q, and 17R, the displacement of the upper cam assembly 30052 and upper expansion segments 30054 in the direction 30096 will cause the lower expansion segments 30058 to ride up the cam surfaces 30052*e* of the cam arms 30052*d* of the upper cam assembly 30052 while also pivoting about the lower tubular hinge segment 30064, and will also cause the upper expansion segments 30054 to ride up the cam surfaces 30060*e* of the cam arms 30060*d* of the lower cam assembly 30060 while also pivoting about the upper tubular hinge segment 30050. In an exemplary embodiment, when the upper and lower expansion segments, 30054 and 30058, are brought into axial alignment, they define an outer expansion surface that is approximately contiguous in a circumferential direction and which provides an outer expansion surface that at least approximates a conical surface.

In an exemplary embodiment, during the operation of the adjustable casing expansion cone assembly 30, when the upper and lower expansion segments, 30054 and 30058, brought into axial alignment into a radially expanded position, the upper and lower expansion segments, 30054 and 30058, are displaced relative to the expandable wellbore casing 100 to thereby radially expand and plastically deform at least a portion of the expandable wellbore casing. In an exemplary embodiment, during the radial expansion and plastic deformation of the expandable wellbore casing 100, the adjustable casing expansion cone assembly 30 may then be rotated relative to the expandable wellbore casing to enhance and/or modify the rate at which the expandable wellbore casing is radially expanded and plastically deformed.

In an exemplary embodiment, the upper cam assembly 30052 and the upper expansion segments 30054 may be moved out of engagement with the lower expansion segments 30058 and the lower cam assembly 30060 by reducing the operating pressure within the annulus 30094.

Figure 17T:
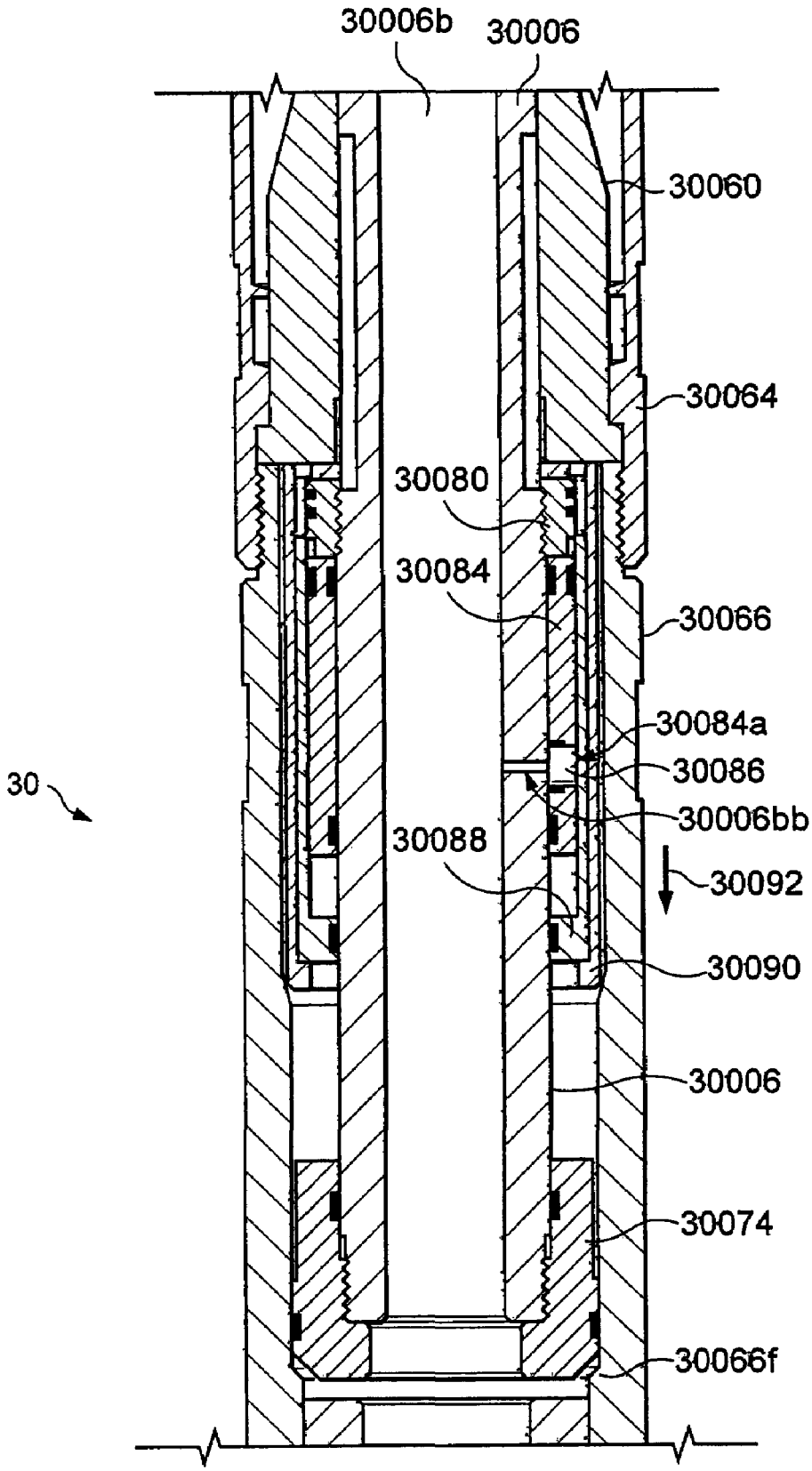

In an alternative embodiment, as illustrated in FIGS. 17S, 17T, 17U and 17V, during operation of the adjustable casing expansion cone assembly 30, the upper cam assembly 30052 and the upper expansion segments 30054 may also be moved out of engagement with the lower expansion segments 30058 and the lower cam assembly 30060 by sensing the operating pressure within the longitudinal passage 30006*b* of the lower tubular mandrel 30006. In particular, as illustrated in FIG. 17T, if the operating pressure within the longitudinal passage 30006*b* and radial passage 30006*bb* of the lower tubular mandrel 30006 exceeds a predetermined value, the burst disc 30086 will open the passage 30084*a* thereby pressurizing the interior of the tubular release sleeve 30088 thereby displacing the tubular release sleeve 30088 downwardly in a direction 30092 away from engagement with the locking dogs 30080.

Figure 17U:
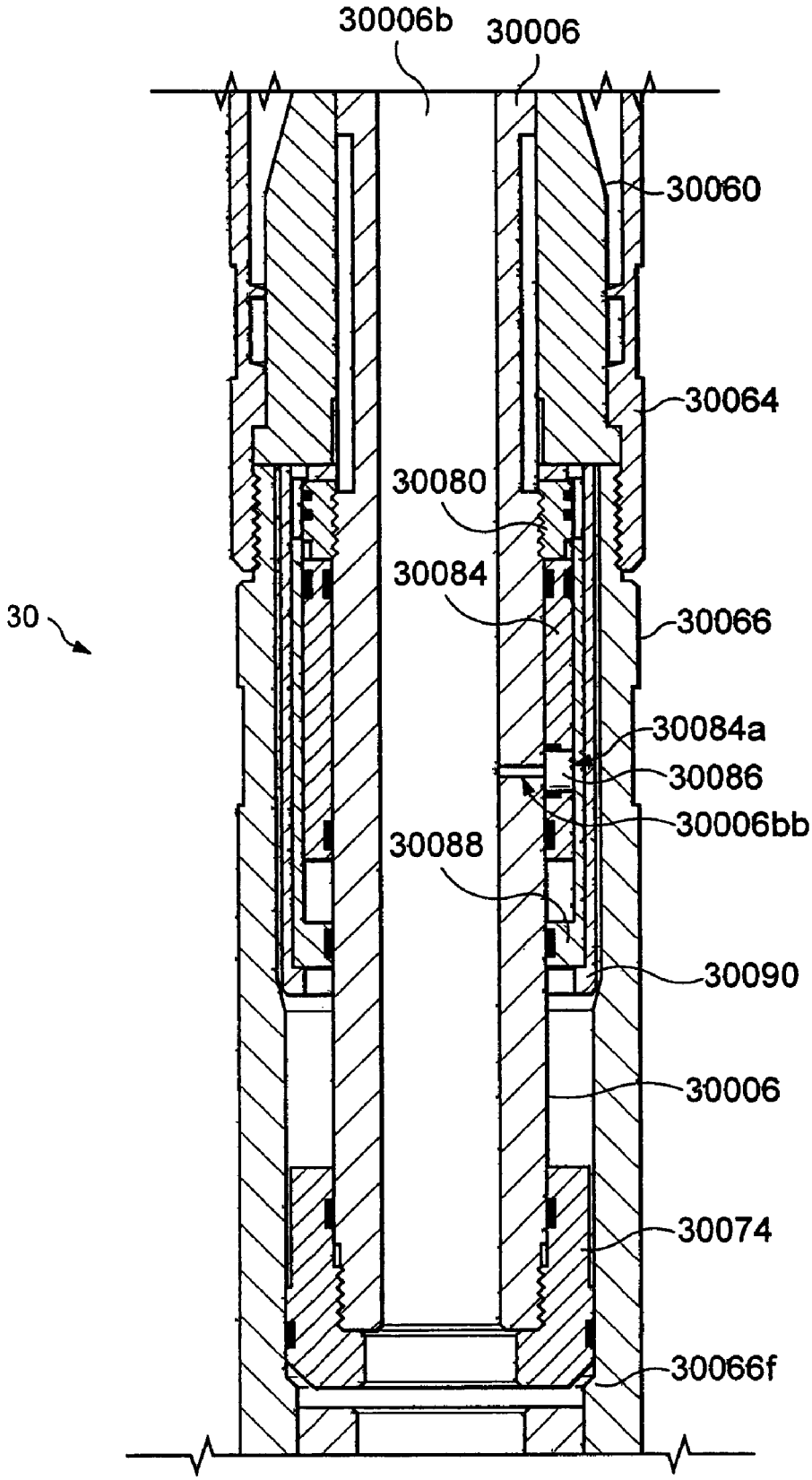

As a result, as illustrated in FIG. 17U, the locking dogs 30080 are displaced outwardly in the radial directed and thereby released from engagement with the lower tubular mandrel 30006 thereby permitting the lower expansion segments 30058 and the lower cam assembly 30060 to be displaced downwardly relative to the lower tubular mandrel.

Figure 17V:
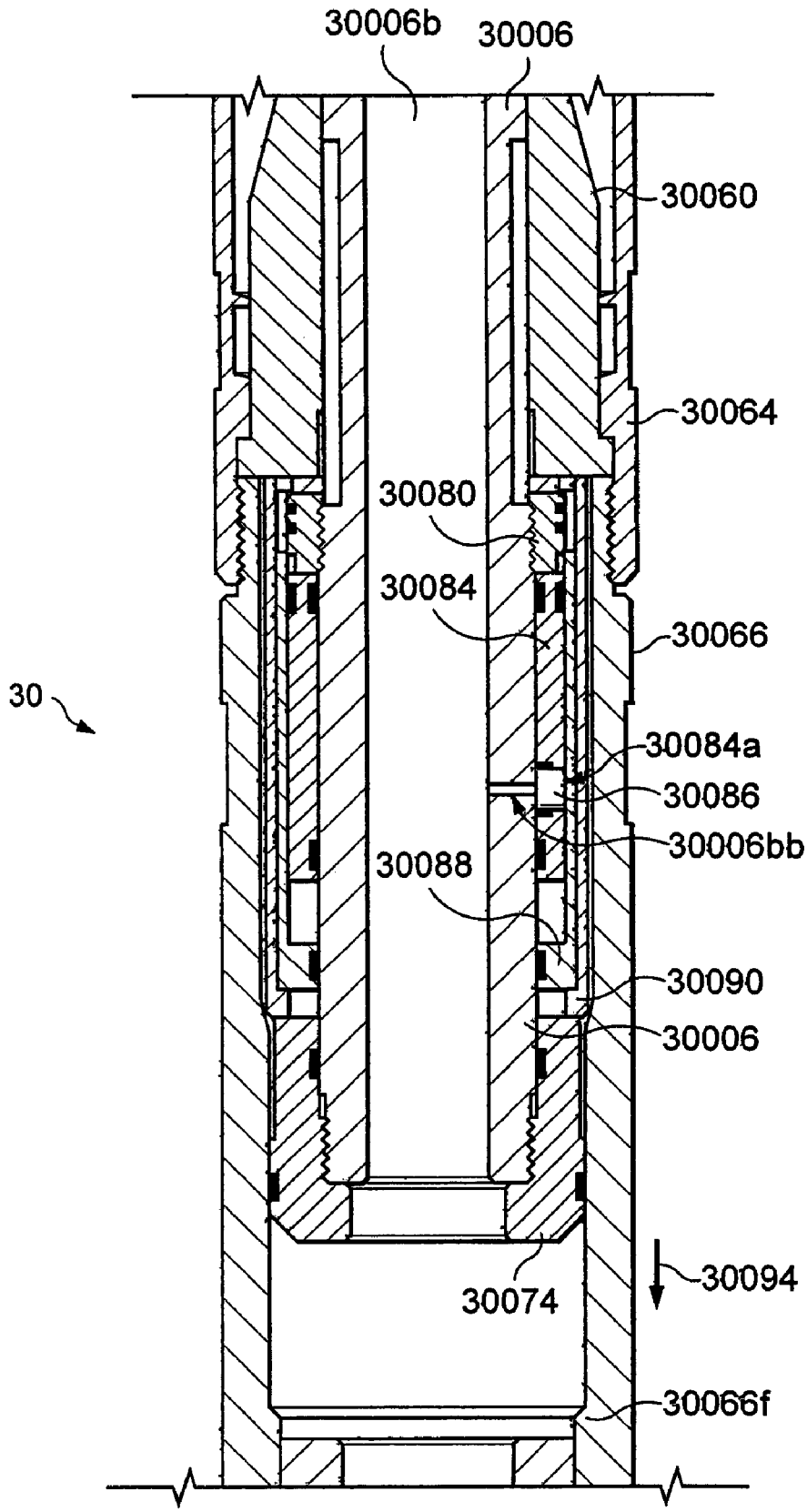

As a result, as illustrated in FIG. 17V, the operating pressure within the lower tubular mandrel 30066 may then cause the lower tubular mandrel to be displaced downwardly in the direction 30094 relative to the tubular lower mandrel 30006 and the retracting piston 30074. As a result, the lower tubular mandrel 30066, the lower expansion segments 30058, the lower cam assembly 30060, and tubular lower hinge sleeve 30064 are displaced downwardly in the direction 30094 relative to the tubular spring housing 30034 thereby moving the lower expansion segments 30058 and the lower cam assembly 30060 out of engagement with the upper cam assembly 30052 and the upper expansion segments 30054.

Figure 17W:
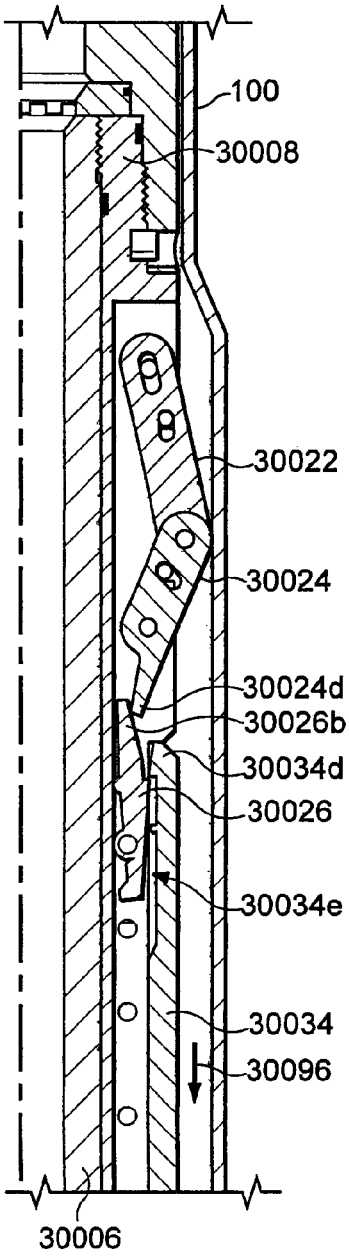
Figure 17X:
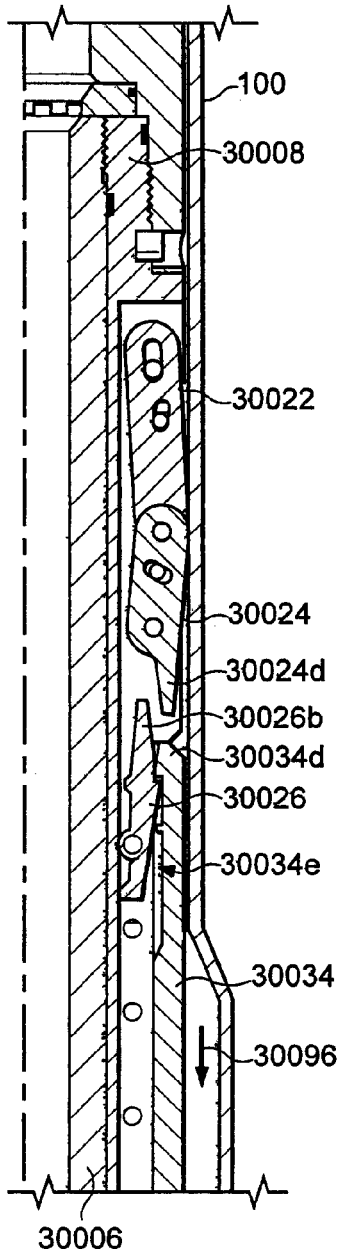
Figure 17Y:
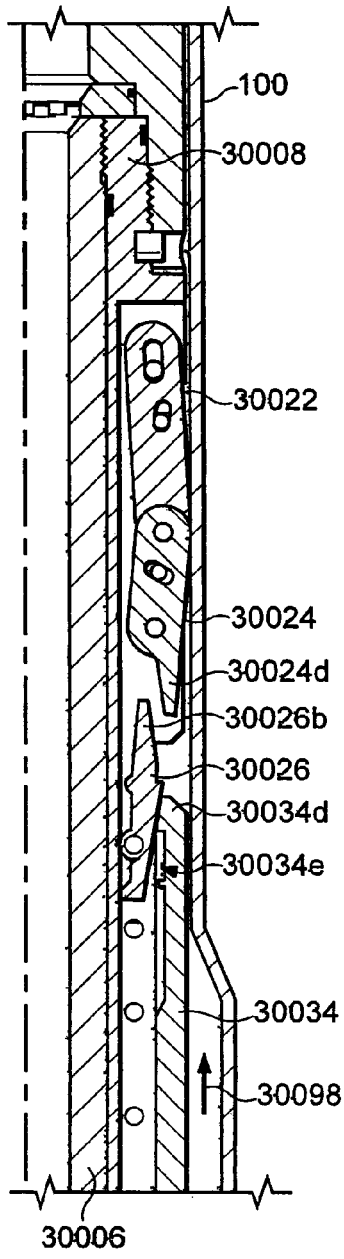

In an exemplary embodiment, as illustrated in FIGS. 17W, 17X, and 17Y, during operation of the adjustable casing expansion cone assembly 30, the adjustable casing expansion cone assembly senses the diameter of the expandable wellbore casing 100 using the upper toggle links, 30022 and 30028, lower toggle links, 30024 and 30030, and triggers, 30026 and 30032, and then prevents the engagement of the upper cam assembly 30052 and the upper expansion segments 30054 with the lower expansion segments 30058 and the lower cam assembly 30060.

In particular, as illustrated in FIG. 17W, anytime the upper toggle links, 30022 and 30028, and lower toggle links, 30024 and 30030, are positioned within a portion of the expandable wellbore casing 100 that has been radially expanded and plastically deformed by the system 10, the triggers, 30026 and 30032, will be pivoted by the engagement arms, 30024*d* and 30030*d*, of the lower toggle links, 30024 and 30030, to a position in which the triggers will no longer engage the internal flange 30034*d* of the end of the tubular spring housing 30034 thereby permitting the displacement of the tubular spring housing in the direction 30096. As a result, the upper cam assembly 30052 and the upper expansion segments 30054 can be brought into engagement with the lower expansion segments 30058 and the lower cam assembly 30060. In an exemplary embodiment, the upper toggle links, 30022 and 30028, and the lower toggle links, 30024 and 30030, are spring biased towards the position illustrated in FIG. 17W.

Conversely, as illustrated in FIG. 17X, anytime the upper toggle links, 30022 and 30028, and lower toggle links, 30024 and 30030, are positioned within a portion of the expandable wellbore casing 100 that has not been radially expanded and plastically deformed by the system 10, the triggers, 30026 and 30032, will be maintained in a position in which the triggers will engage the internal flange 30034*d* of the end of the tubular spring housing 30034 thereby preventing the displacement of the tubular spring housing in the direction 30096. As a result, the upper cam assembly 30052 and the upper expansion segments 30054 cannot be brought into engagement with the lower expansion segments 30058 and the lower cam assembly 30060. In an exemplary embodiment, the triggers, 30026 and 30032, are spring biased towards the position illustrated in FIG. 17X.

In an exemplary embodiment, as illustrated in FIG. 17Y, the tubular spring housing 30034 may be displaced upwardly in the direction 30098 even if the upper toggle links, 30022 and 30028, and lower toggle links, 30024 and 30030, are positioned within a portion of the expandable wellbore casing 100 that has not been radially expanded and plastically deformed by the system 10.

In an exemplary embodiment, as illustrated in FIGS. 17Z1 to 17Z4, 17AA1 to 17AA4, 17AB1 to 17AB4, 17AC1 to 17AC4, 17AD, and 17AE, the tubular spring housing 30034 of the adjustable casing expansion cone assembly 30 defines internal annular recesses 30034*k* and 300341, spaced apart by an internal flange 30034*m*, the tubular toggle bushing 30008 defines an external annular recess 30008*ac*, and the adjustable casing expansion cone assembly further includes pins, 30100*a* and 30100*b* and 30102*a* and 30102*b*, mounted in holes 30008*j* and 30008*o* and 30008*k* and 30008*n*, respectively, of the tubular toggle bushing, and a one-shot deactivation device 30104 mounted on the tubular toggle bushing between the pins, 30100*a* and 30100*b* and 30102*a* and 30102*b*.

The one-shot deactivation device 30104 includes a tubular body 30104*a* that defines radial holes, 30104*b* and 30014*c*, and includes an external annular recess 30104*d* at one end, a centrally positioned external flange 30104*e*, a centrally positioned internal annular recess 30104*f*, and an external annular recess 30104*g* at another end. An engagement member 30106 that includes a base member 30106*a* having a tapered end 30106*b* and a key member 30106*c* having a tapered end 30106*d* is received within a portion of the internal annular recess 30104*f* of the tubular body 30104*a* and an engagement member 30108 that includes a base member 30108*a* having a tapered end 30108*b* and a key member 30108*c* having a tapered end 30108*d* is received within an opposite portion of the internal annular recess 30104*f* of the tubular body 30104*a*. Spring members, 30110 and 30112, are received within the annular recess 30104*f* of the tubular body 30104*a* for biasing the base members, base member 30106*a* and 30108*a*, of the engagement members, 30106 and 30108, respectively, radially inwardly relative to the tubular body 30104*a*.

In an exemplary embodiment, during operation of the adjustable bell section expansion cone assembly 28, as illustrated in FIG. 17Z, the one-shot deactivation device 30104 are positioned proximate and in intimate contact with the pins, 30102*a* and 30102*b*, with the tapered ends, 30106*b* and 30108*b*, of the base members, 30106*a* and 30108*a*, of the engagement members, 30106 and 30108, received within the external annular recess 30008*ac* of the tubular toggle bushing 30008. When the one-shot deactivation device 30104 is positioned as illustrated in FIG. 17Z, the external annular recess

30104*d* of the tubular body 30104*a* of the one-shot deactivation device is moved out of engagement with the engagement arms, 30026*d* and 30032*d*, of the triggers, 30026 and 30032, respectively. As a result, the triggers, 30026 and 30032, may operate normally as described above with reference to FIGS. 17W, 17X, and 17Y.

Figure 17A:
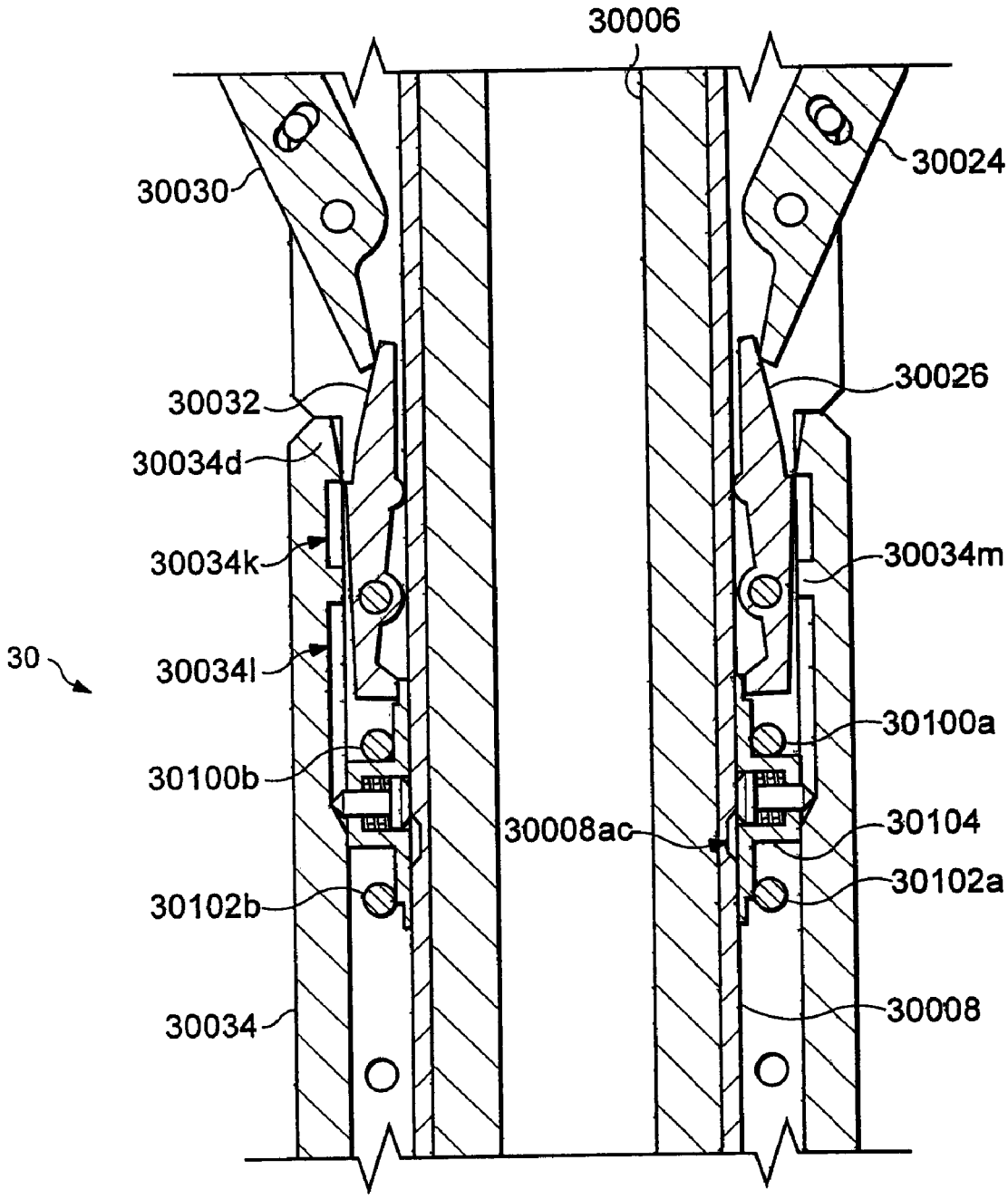
Figure 17A:
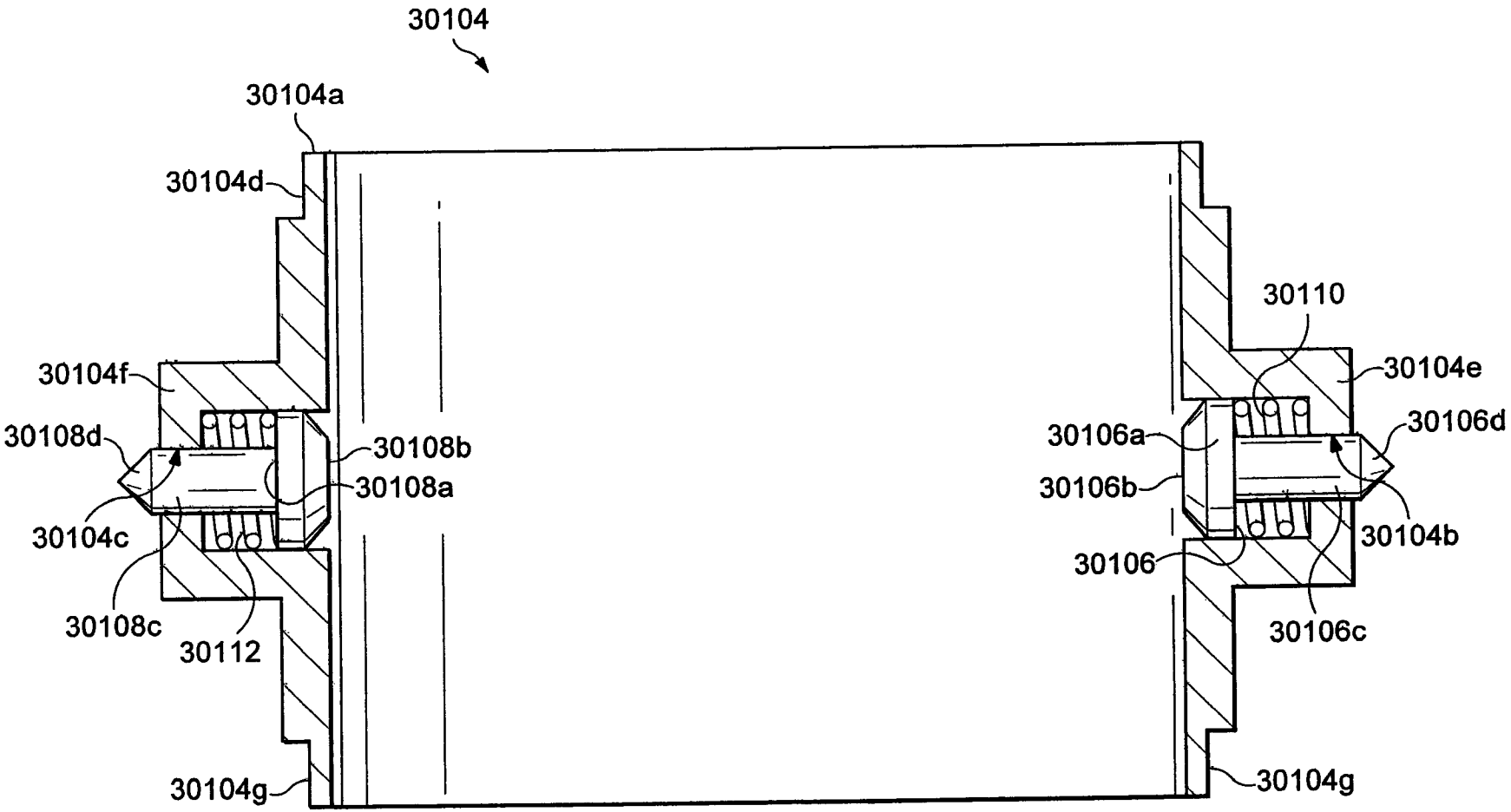

Conversely, in an exemplary embodiment, during operation of the adjustable casing expansion cone assembly 30, as illustrated in FIGS. 17AA1 to 17AA4, the one-shot deactivation device 30104 are positioned proximate and in intimate contact with the pins, 30100*a* and 30100*b*, with the tapered ends, 30106*b* and 30108*b*, of the base members, 30106*a* and 30108*a*, of the engagement members, 30106 and 30108, not received within the external annular recess 30008*ac* of the tubular toggle bushing 30008. When the one-shot deactivation device 30104 is positioned as illustrated in FIGS. 17AA1 to 17AA4, the external annular recess 30104*d* of the tubular body 30104*a* of the one-shot deactivation device is moved into engagement with the engagement arms, 30026*d* and 30032*d*, of the triggers, 30026 and 30032, respectively. As a result, the triggers, 30026 and 30032, are deactivated and may not operate normally as described above with reference to FIGS. 17W, 17X, and 17Y.

In an alternative embodiment, the elements of the adjustable casing expansion cone assembly 30 that sense the diameter of the expandable wellbore casing 100 may be disabled or omitted or adjusted to sense any pre-selected internal diameter of the expandable wellbore casing.

Figure 18A:
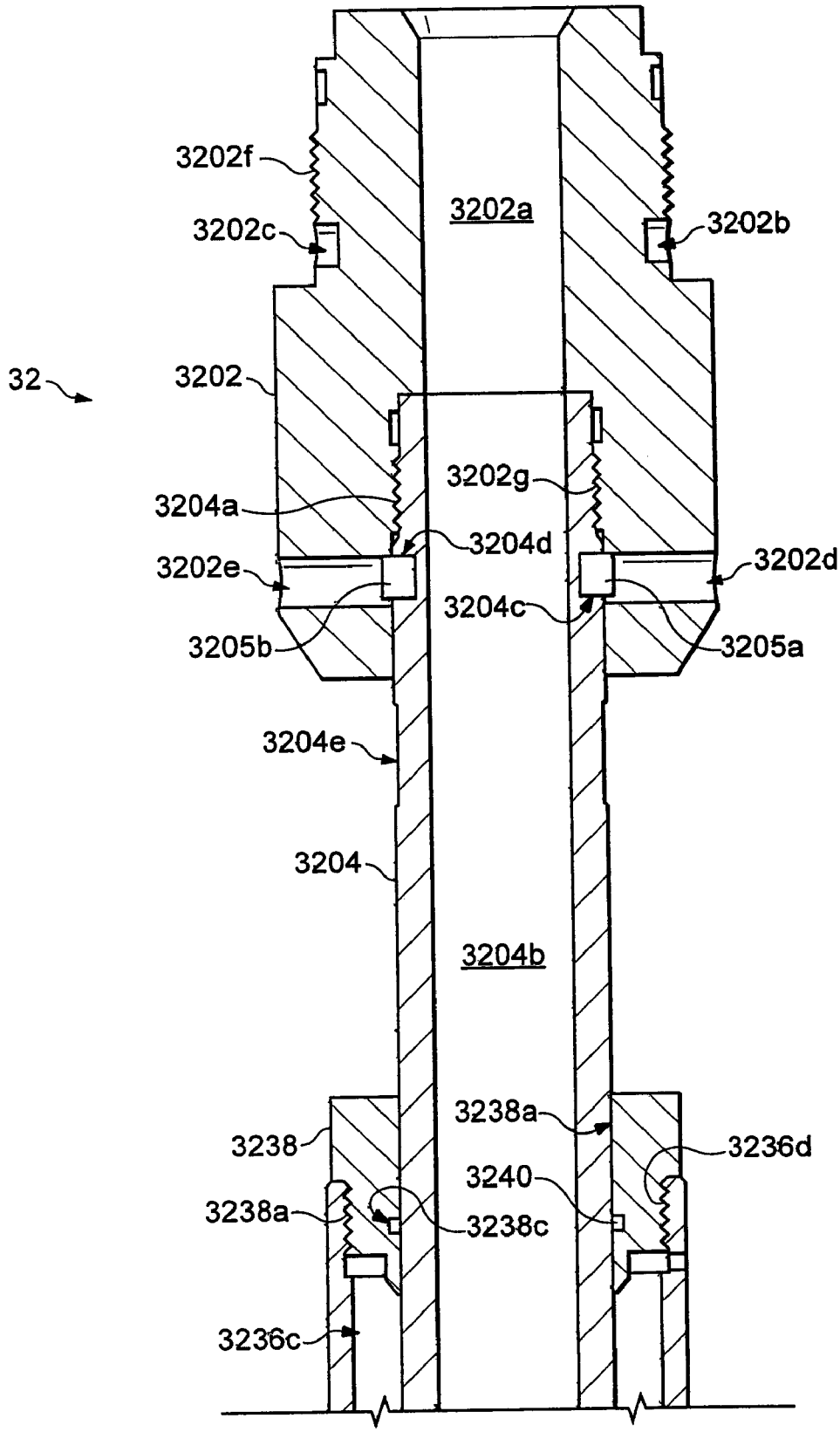
FIGS. 18A to 18C is a fragmentary cross-sectional illustration of an exemplary embodiment of a packer setting tool assembly.
Figure 18B:
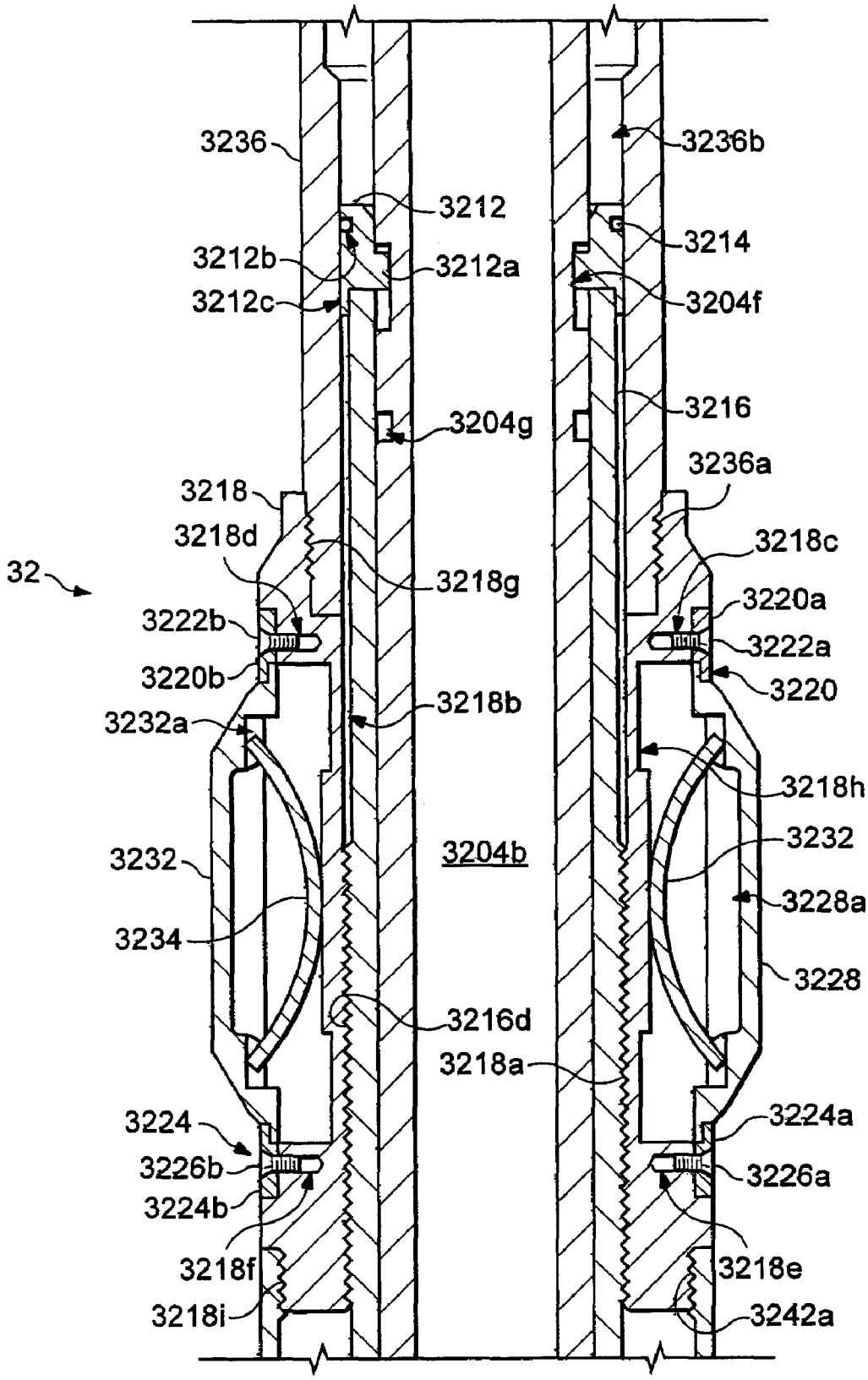
Figure 18C:
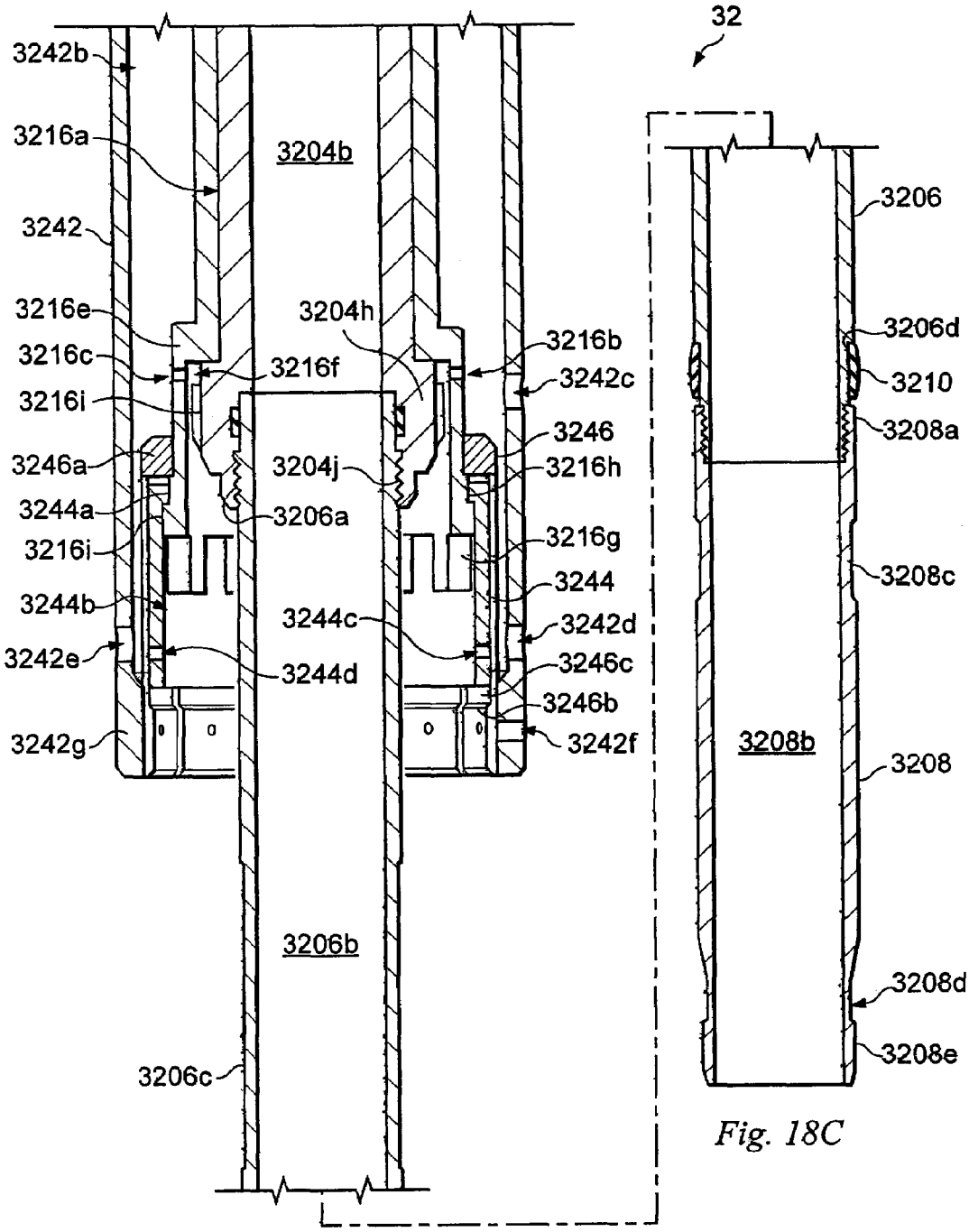

In an exemplary embodiment, as illustrated in FIGS. 18A to 18C, the packer setting tool assembly 32 includes a tubular adaptor 3202 that defines a longitudinal passage 3202*a*, radial external mounting holes, 3202*b* and 3202*c*, radial passages, 3202*d* and 3202*e*, and includes an external threaded connection 3202*f* at one end and an internal annular recess 3202*g* having an internal threaded connection at another end. An external threaded connection 3204*a* of an end of a tubular upper mandrel 3204 that defines a longitudinal passage 3204*b*, internally threaded external mounting holes, 3204*c* and 3204*d*, and includes an external annular recess 3204*e*, external annular recess 3204*f*, external annular recess 3204*g*, external flange 3204*h*, external splines 3204*i*, and an internal threaded connection 3204*j* at another end is received within and is coupled to the internally threaded connection of the internal annular recess 3202*g* of the other end of the tubular adaptor 3202. Mounting screws, 3205*a* and 3205*b*, are received within and coupled to the mounting holes, 3204*c* and 3204*d*, of the tubular upper mandrel 3204 that also extend into the radial passages, 3202*d* and 3202*e*, of the tubular adaptor 3202.

An external threaded connection 3206*a* of an end of a mandrel 3206 that defines a longitudinal passage 3206*b* and includes an external annular recess 3206*c* and an external annular recess 3206*d* having an external threaded connection is received within and is coupled to the internal threaded connection 3204*j* of the tubular upper mandrel 3204. An internal threaded connection 3208*a* of a tubular stinger 3208 that defines a longitudinal passage 3208*b* and includes an external annular recess 3208*c*, and an external tapered annular recess 3208*d* and an engagement shoulder 3208*e* at another end receives and is coupled to the external threaded connection of the external annular recess 3206*d* of the mandrel 3206. A sealing member 3210 is mounted upon and coupled to the external annular recess 3206*d* of the mandrel 3206.

An internal flange 3212*a* of a tubular key 3212 that includes an external annular recess 3212*b* at one end and an internal annular recess 3212*c* at another end is movably received within and engages the external annular recess 3204*f* of the tubular upper mandrel 3204. A garter spring 3214 is received within and engages the external annular recess 3212*b* of the tubular key 3212.

An end of a tubular bushing 3216 that defines a longitudinal passage 3216*a* for receiving and mating with the upper mandrel 3204, and radial passages, 3216*b* and 3216*c*, and includes an external threaded connection 3216*d* at an intermediate portion, and an external flange 3216*e*, an internal annular recess 3216*f*, circumferentially spaced apart teeth 3216*g*, and external flanges, 3216*h* and 3216*i*, at another end is received within and mates with the internal annular recess 3212*c* of the tubular key 3212. An internal threaded connection 3218*a* of a tubular drag block body 3218 that defines a longitudinal passage 3218*b* for receiving the tubular bushing 3216, mounting holes, 3218*c* and 3218*d*, mounting holes, 3218*e* and 3218*f*, and includes an internal threaded connection 3218*g* at one end, a centrally positioned external annular recess 3218*h*, and an external threaded connection 3218*i* at another end is received within and coupled to the external threaded connection 3216*d* of the tubular bushing 3216.

A first tubular keeper 3220 that defines mounting holes, 3220*a* and 3220*b*, is coupled to an end of the tubular drag block body 3218 by mounting screws, 3222*a* and 3222*b*, that are received within and are coupled to the mounting holes, 3218*c* and 3218*d*, of the tubular drag block body. A second tubular keeper 3224 that defines mounting holes, 3224*a* and 3224*b*, is coupled to an end of the tubular drag block body 3218 by mounting screws, 3226*a* and 3226*b*, that are received within and are coupled to the mounting holes, 3218*e* and 3218*f*, of the tubular drag block body.

Drag blocks, 3228 and 3230, that are received within the external annular recess 3218*h* of the tubular drag block body 3218, include ends that mate with and are received within the end of the first tubular keeper 3220, and other ends that mate with and are received within the end of the second tubular keeper 3224. The drag blocks, 3228 and 3230, further include internal annular recesses, 3228*a* and 3230*a*, respectively, that receive and mate with ends of springs, 3232 and 3234, respectively. The springs, 3232 and 3234, also receive and mate with the external annular recess 3218*h* of the tubular drag block body 3218.

An external threaded connection 3236*a* of an end of a tubular releasing cap extension 3236 that defines a longitudinal passage 3236*b* and includes an internal annular recess 3236*c* and an internal threaded connection 3236*d* at another end is received within and is coupled to the internal threaded connection 3218*g* of the tubular drag block body 3218. An external threaded connection 3238*a* of an end of a tubular releasing cap 3238 that defines a longitudinal passage 3238*b* and includes an internal annular recess 3238*c* is received within and coupled to the internal threaded connection 3236*d* of the tubular releasing cap extension 3236. A sealing element 3240 is received within the internal annular recess 3238*c* of the tubular releasing cap 3238 for fluidicly sealing the interface between the tubular releasing cap and the upper mandrel 3204.

An internal threaded connection 3242*a* of an end of a tubular setting sleeve 3242 that defines a longitudinal passage 3242*b*, radial passage 3242*c*, radial passages, 3242*d* and 3242*e*, radial passage 3242*f*, and includes an internal flange 3242*g* at another end receives the external threaded connection 3218*i* of the tubular drag block body 3218. An internal flange 3244*a* of a tubular coupling ring 3244 that defines a longitudinal passage 3244*b* and radial passages, 3244*c* and 3244*d*, receives and mates with the external flange 3216*h* of the tubular bushing 3216 and an end face of the internal flange of the tubular coupling ring is positioned proximate and in opposing relation to an end face of the external flange 3216*i* of the tubular bushing.

An internal flange 3246*a* of a tubular retaining collet 3246 that includes a plurality of axially extending collet fingers 3246*b*, each having internal flanges 3246*c* at an end of each collet finger, for engaging and receiving the tubular coupling ring 3244 receives and mates with external flange 3216*e* of the tubular bushing 3216 and an end face of the internal flange of the tubular retaining collet is positioned proximate and in opposing relation to an end face of the external flange 3216*h* of the tubular bushing.

In an exemplary embodiment, the packer assembly 36 operates and is provided substantially, at least in part, as disclosed in one or more of the following: (1) PCT patent application Ser. No. PCT/US03/14153, filed on Nov. 13, 2003, and/or (2) PCT patent application Ser. No. PCT/US03/29460, filed on Sep. 23, 2003, and/or (3) PCT patent application Ser. No. PCT/US04/07711, filed on Mar. 11, 2004, and/or (4) PCT patent application Ser. No. PCT/US04/009434, filed on Mar. 26, 2004, and/or (5) PCT patent application Ser. No. PCT/US04/010317, filed on Apr. 2, 2004, and/or (6) PCT patent application Ser. No. PCT/US04/010712, filed on Apr. 7, 2004, and/or (7) PCT patent application Ser. No. PCT/US04/010762, filed on Apr. 6, 2004, and/or PCT application Ser. No. PCT/US04/011973, 25791.277.02, filed on Apr. 15, 2004, the disclosures of which are incorporated herein by reference.

Figures 1, 19:
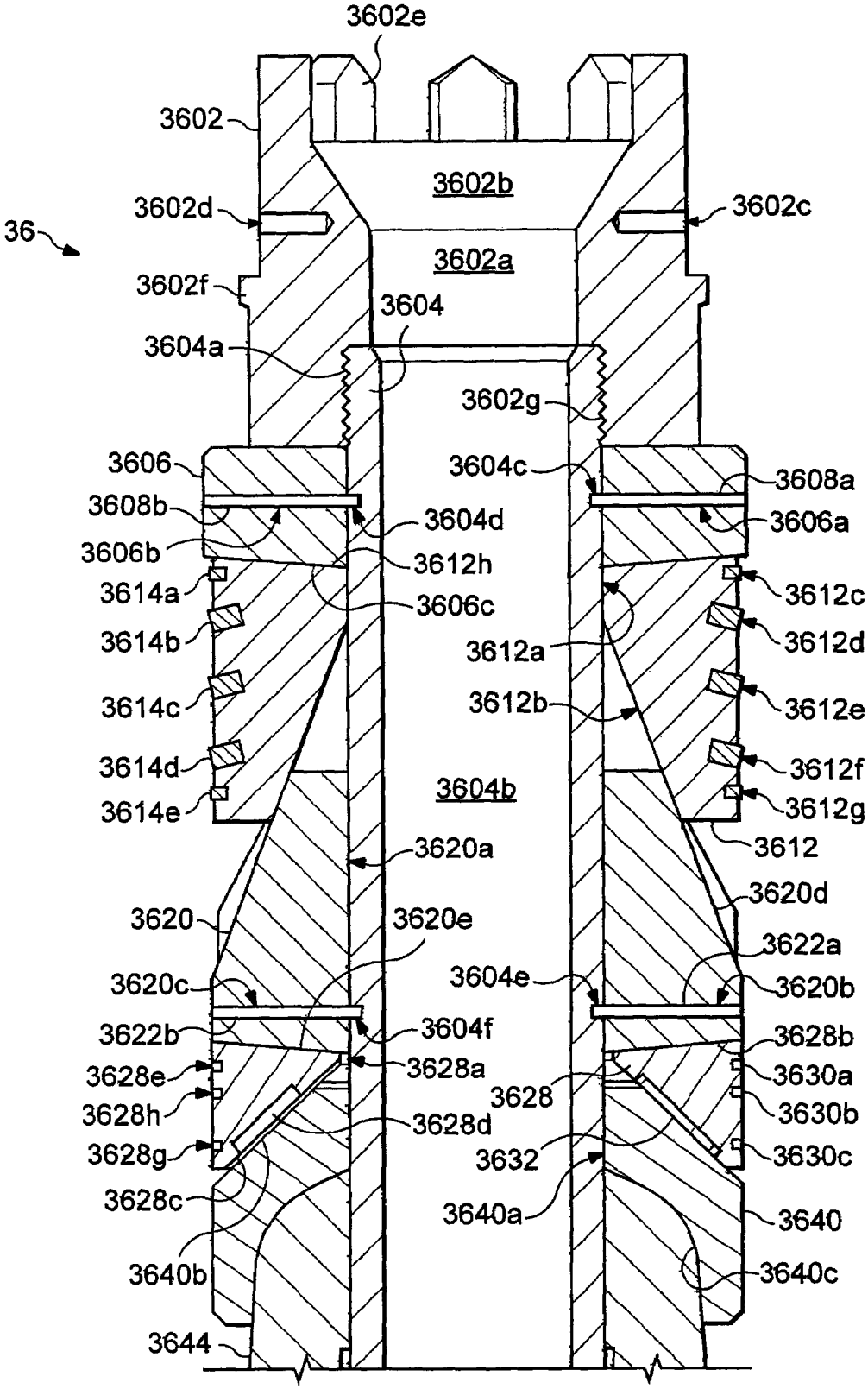
Figures 2, 19:
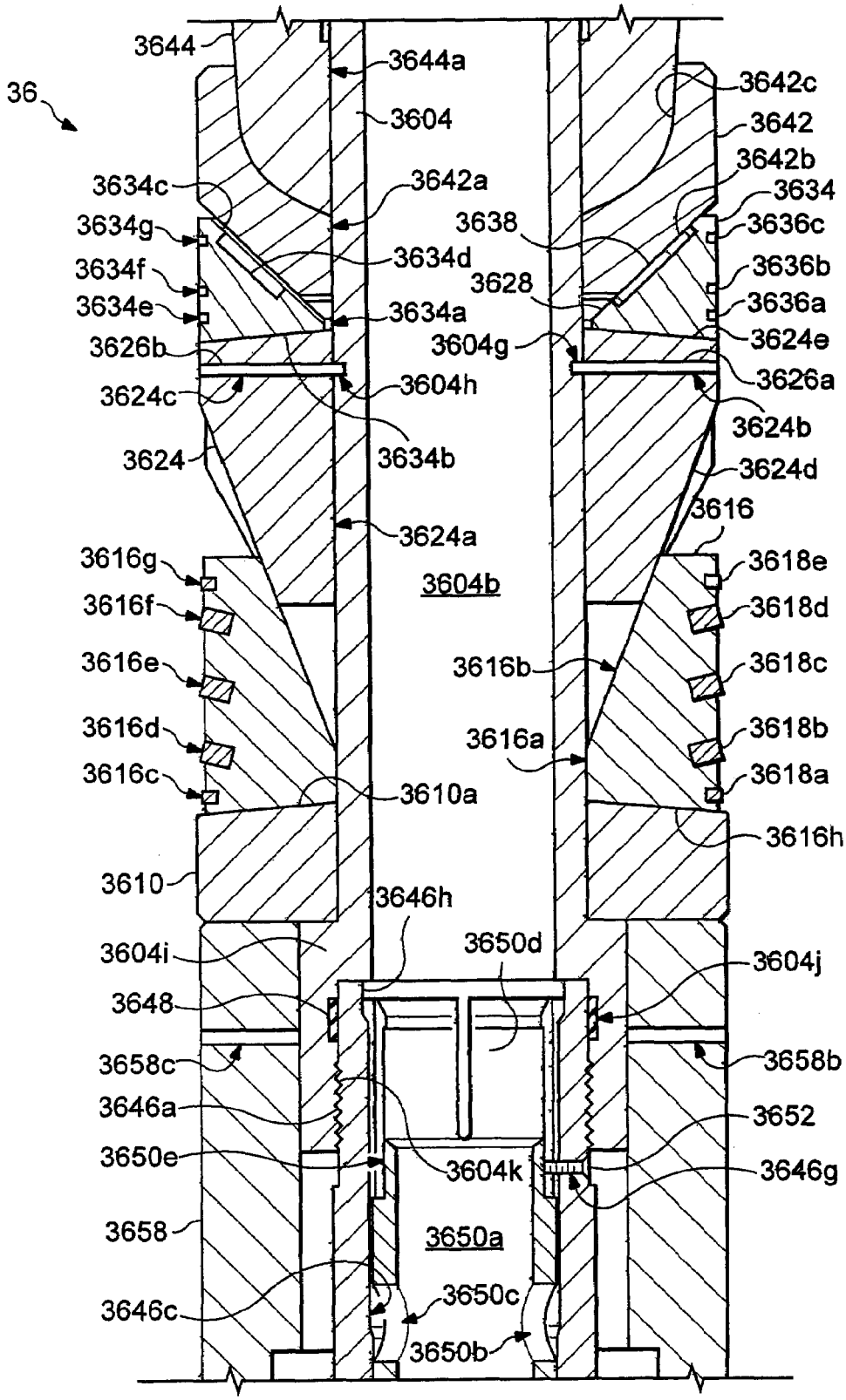
Figures 3, 19:
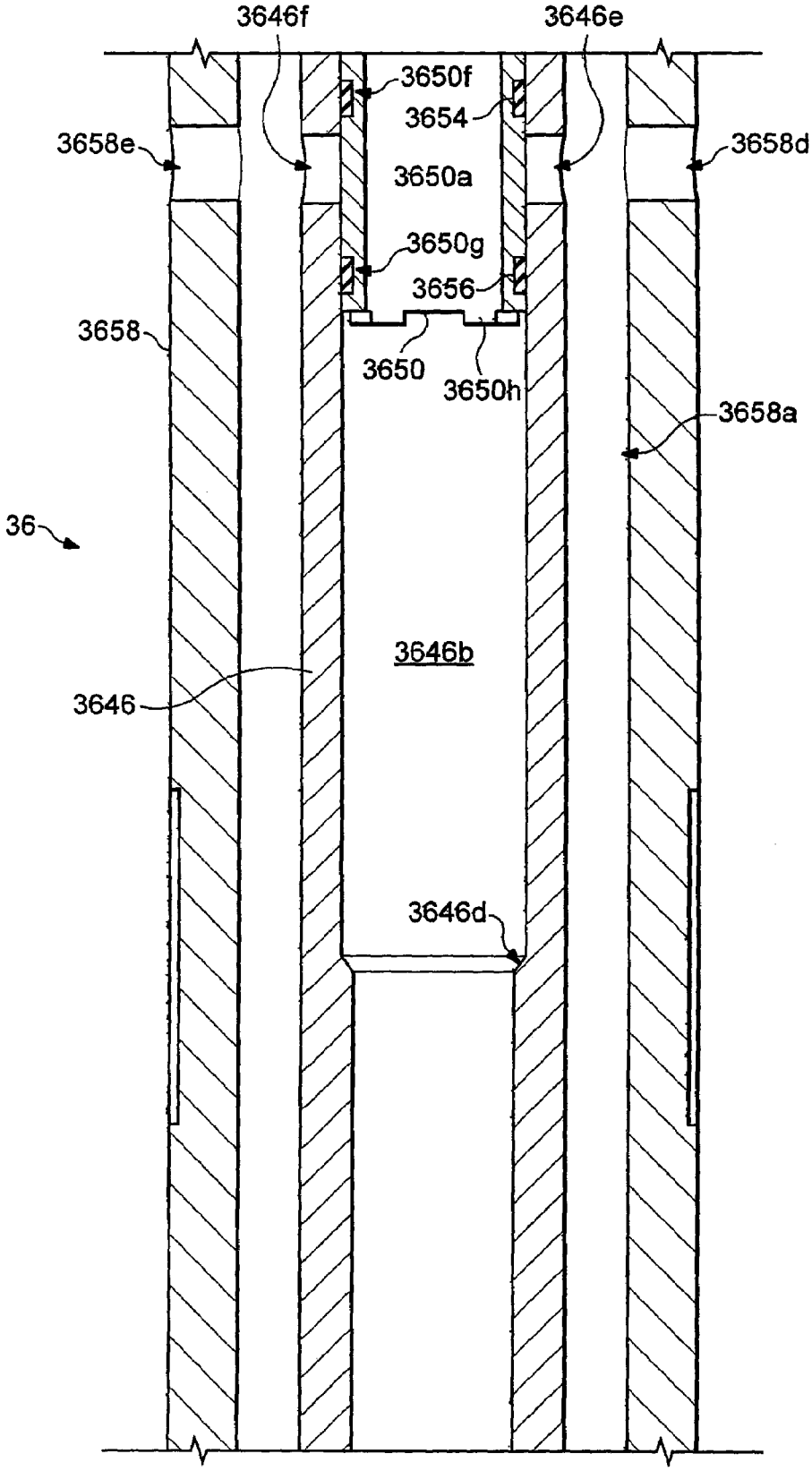
Figures 4, 19:
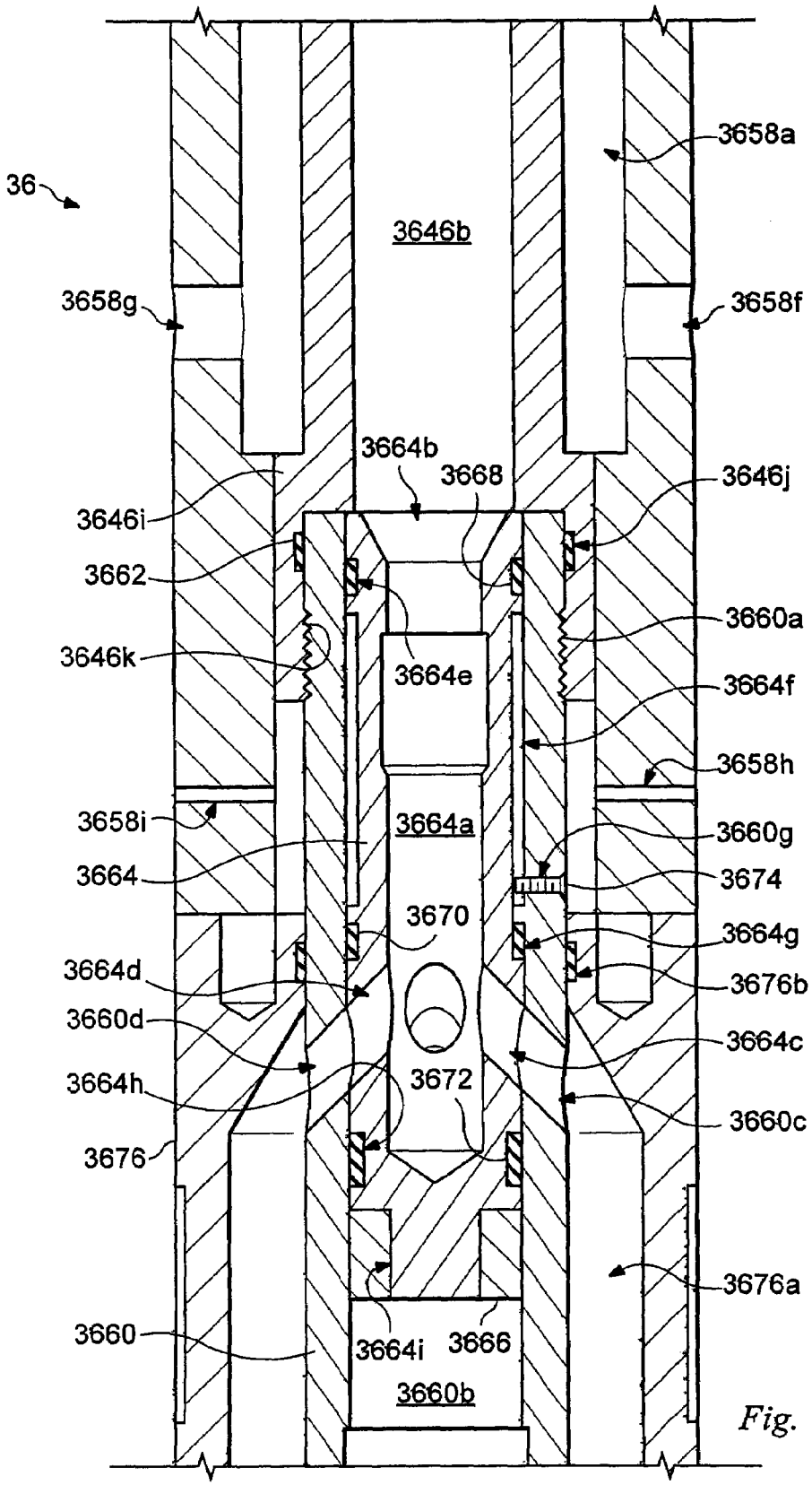
Figures 5, 19:
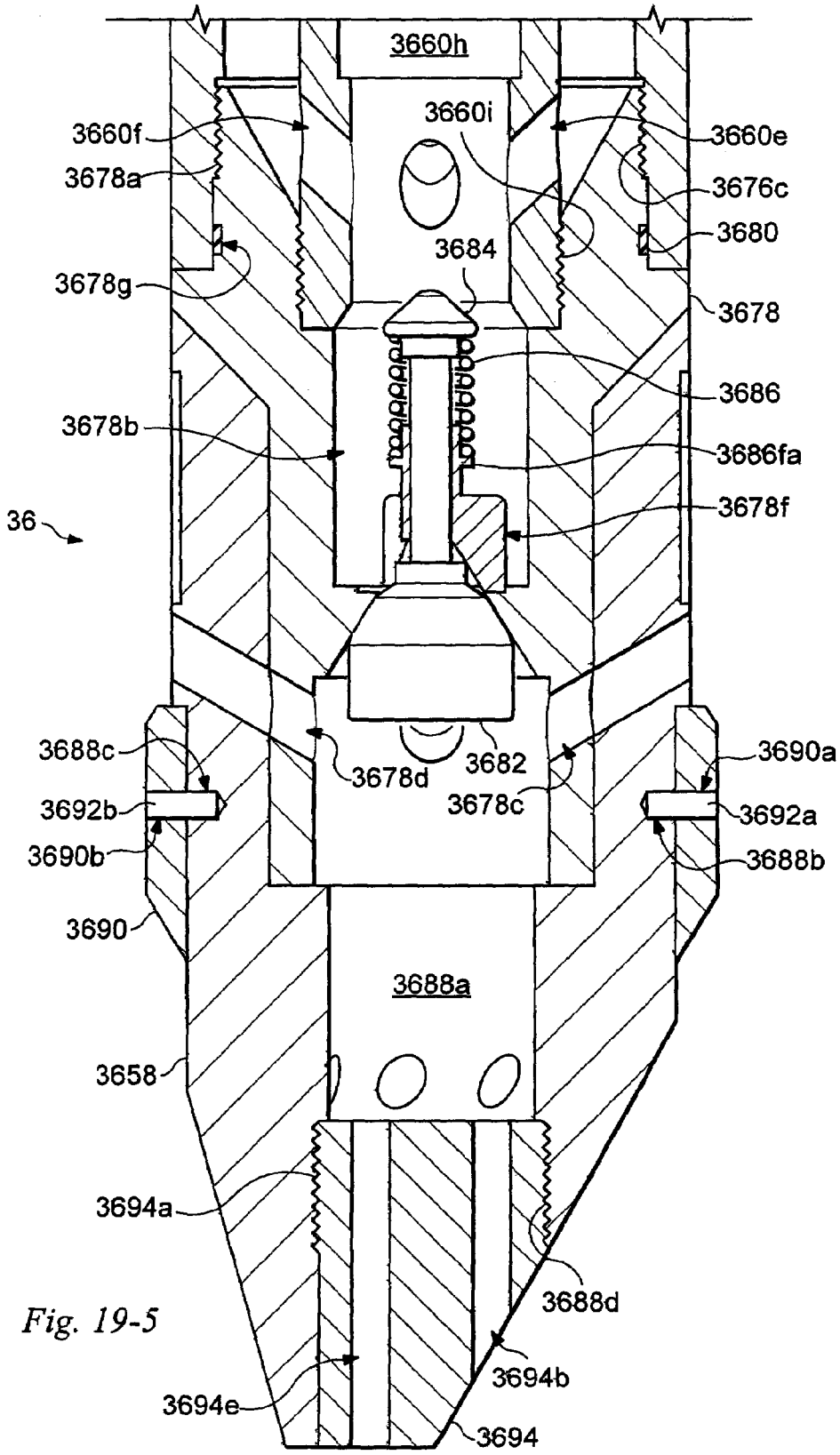

In an exemplary embodiment, as illustrated in FIGS. 19-1 to 19-5, the packer assembly 36 includes a tubular upper adaptor 3602 that defines a longitudinal passage 3602*a* having a tapered opening 3602*b* and mounting holes, 3602*c* and 3602*d*, that includes a plurality of circumferentially spaced apart teeth 3602*e* at one end, an external flange 3602*f*, and an internal threaded connection 3602*g* at another end. In an exemplary embodiment, the tubular upper adaptor 3602 is fabricated from aluminum. An external threaded connection 3604*a* of an end of a tubular upper mandrel 3604 that defines a longitudinal passage 3604*b*, mounting holes, 3604*c* and 3604*d*, mounting holes, 3604*e* and 3604*f*, and mounting holes, 3604*g* and 3604*h*, and includes an external flange 3604*i*, an internal annular recess 3604*j*, and an internal threaded connection 3604*k* at another end is received within and coupled to the internal threaded connection 3602*g* of the tubular upper adaptor 3602. In an exemplary embodiment, the tubular upper mandrel 3604 is fabricated from aluminum.

An upper tubular spacer ring 3606 that defines mounting holes, 3606*a* and 3606*b*, receives and mates with the end of the tubular upper mandrel 3604 and includes an angled end face 3606*c* and another end face that is positioned proximate to an end face of the tubular upper adaptor 3602 is coupled to the tubular upper mandrel by shear pins, 3608*a* and 3608*b*, that are mounted within and coupled to the mounting holes, 3604*c* and 3606*a*, and, 3604*d* and 3606*b*, respectively, of the tubular upper mandrel and upper tubular spacer ring, respectively. A lower tubular spacer ring 3610 that includes an angled end face 3610*a* receives, mates, and is coupled to the other end of the tubular upper mandrel 3604 and includes another end face that is positioned proximate to an end face of the external flange 3604*i* of the tubular upper mandrel 3604. In an exemplary embodiment, the upper and tubular spacer rings, 3606 and 3610, are fabricated from a composite material.

A sealing element or upper tubular slip 3612 that receives and is movably mounted upon the tubular upper mandrel 3604 defines a longitudinal passage 3612*a* having a tapered opening 3612*b* and includes external annular recesses, 3612*c*, 3612*d*, 3612*e*, 3612*f*, and 3612*g*, and an angled end face 3612*h* that mates with and is positioned proximate the angled end face 3606*c* of the upper tubular spacer ring 3606. Slip retaining bands, 3614*a*, 3614*b*, 3614*c*, 3614*d*, and 3614*e*, are received within and coupled to the external annular recesses, 3612*c*, 3612*d*, 3612*e*, 3612*f*, and 3612*g*, of the upper tubular slip 3612. A sealing element or lower tubular slip 3616 that receives and is movably mounted upon the tubular upper mandrel 3604 defines a longitudinal passage 3616*a* having a tapered opening 3616*b* and includes external annular recesses, 3616*c*, 3616*d*, 3616*e*, 3616*f*, and 3616*g*, and an angled end face 3616*h* that mates with and is positioned proximate the angled end face 3610*a* of the lower tubular spacer ring 3610. Slip retaining bands, 3618*a*, 3618*b*, 3618*c*, 3618*d*, and 3618*e*, are received within and coupled to the external annular recesses, 3616*c*, 3616*d*, 3616*e*, 3616*f*, and 3616*g*, of the lower tubular slip 3616. In an exemplary embodiment, the upper and lower tubular slips, 3612 and 3616, are fabricated from composite materials, and at least some of the slip retaining bands, 3614*a*, 3614*b*, 3614*c*, 3614*d*, 3614*e*, 3618*a*, 3618*b*, 3618*c*, 3618*d*, and 3618*e* are fabricated from carbide insert materials. In an exemplary embodiment, one or more of the slip retaining bands, 3614*a*, 3614*b*, 3614*c*, 3614*d*, and 3614*e*, and one or more of the respective external annular recesses, 3612*c*, 3612*d*, 3612*e*, 3612*f*, and 3612*g*, of the upper tubular slip 3612 may be removed from the packer assembly 36. In an exemplary embodiment, one or more of the slip retaining bands, 3618*a*, 3618*b*, 3618*c*, 3618*d*, and 3618*e*, and one or more of the respective external annular recesses, 3616*c*, 3616*d*, 3616*e*, 3616*f*, and 3616*g*, of the lower tubular slip 3616 may be removed from the packer assembly 36.

An upper tubular wedge 3620 that defines an longitudinal passage 3620*a* for receiving the tubular upper mandrel 3604 and mounting holes, 3620*b* and 3620*c*, and includes an angled end face 3620*d* at one end that is received within and mates with the tapered opening 3612*b* of the upper tubular slip 3612, and an angled end face 3620*e* at another end is coupled to the tubular upper mandrel by shear pins, 3622*a* and 3622*b*, mounted within and coupled to the mounting holes, 3604*e* and 3620*b*, and, 3604*f* and 3620*c*, respectively, of the tubular upper mandrel and upper tubular wedge, respectively. A lower tubular wedge 3624 that defines an longitudinal passage 3624*a* for receiving the tubular upper mandrel 3604 and mounting holes, 3624*b* and 3624*c*, and includes an angled end face 3624*d* at one end that is received within and mates with the tapered opening 3616*b* of the lower tubular slip 3616, and an angled end face 3624*e* at another end is coupled to the tubular upper mandrel by shear pins, 3626*a* and 3626*b*, mounted within and coupled to the mounting holes, 3604*g* and 3624*b*, and, 3604*h* and 3624*c*, respectively, of the tubular upper mandrel and lower tubular wedge, respectively. In an exemplary embodiment, the upper and lower tubular wedges, 3620 and 3624, are fabricated from composite materials.

An upper tubular extrusion limiter 3628 that defines a longitudinal passage 3628*a* for receiving the tubular upper mandrel 3604 includes an angled end face 3628*b* at one end that mates with the angled end face 3620*e* of the upper tubular wedge 3620, an angled end face 3628*c* at another end having recesses 3628*d*, and external annular recesses, 3628*e*, 3628*f* and 3628*g*. Retaining bands, 3630*a*, 3630*b*, and 3630*c*, are mounted within and coupled to the external annular recesses, 3628*e*, 3628*f* and 3628*g*, respectively, of the upper tubular extrusion limiter 3628. Circular disc-shaped extrusion preventers 3632 are coupled and mounted within the recesses 3628*d*. A lower tubular extrusion limiter 3634 that defines a longitudinal passage 3634*a* for receiving the tubular upper mandrel 3604 includes an angled end face 3634*b* at one end that mates with the angled end face 3624*e* of the lower tubular wedge 3624, an angled end face 3634*c* at another end having recesses 3634*d*, and external annular recesses, 3634*e*, 3634*f* and 3634*g*. Retaining bands, 3636*a*, 3636*b*, and 3636*c*, are mounted within and coupled to the external annular recesses, 3634*e*, 3634*f* and 3634*g*, respectively, of the lower tubular extrusion limiter 3634. Circular disc-shaped extrusion preventers 3638 are coupled and mounted within the recesses 3634*d*. In an exemplary embodiment, the upper and lower extrusion limiters, 3628 and 3634, are fabricated from composite materials. In an exemplary embodiment, one or more of the retaining bands, 3630*a*, 3630*b*, and 3630*c*, and one or more of the respective external annular recesses, 3628*e*, 3628*f* and 3628*g* of the upper tubular extrusion limiter 3628 may be removed from the packer assembly 36. In an exemplary embodiment, one or more of the retaining bands, 3636*a*, 3636*b*, and 3636*c*, and one or more of the respective external annular recesses, 3634*e*, 3634*f* and 3634*g* of the lower tubular extrusion limiter 3634 may be removed from the packer assembly 36.

A sealing element or upper tubular elastomeric packer element 3640 that defines a longitudinal passage 3640*a* for receiving the tubular upper mandrel 3604 includes an angled end face 3640*b* at one end that mates with and is positioned proximate the angled end face 3628*c* of the upper tubular extrusion limiter 3628 and an curved end face 3640*c* at another end. A lower tubular elastomeric packer element 3642 that defines a longitudinal passage 3642*a* for receiving the tubular upper mandrel 3604 includes an angled end face 3642*b* at one end that mates with and is positioned proximate the angled end face 3634*c* of the lower tubular extrusion limiter 3634 and an curved end face 3642*c* at another end.

A central tubular elastomeric packer element 3644 that defines a longitudinal passage 3644*a* for receiving the tubular upper mandrel 3604 includes a curved outer surface 3644*b* for mating with and engaging the curved end faces, 3640*c* and 3642*c*, of the upper and lower tubular elastomeric packer elements, 3640 and 3642, respectively.

An external threaded connection 3646*a* of a tubular lower mandrel 3646 that defines a longitudinal passage 3646*b* having throat passages, 3646*c* and 3646*d*, and flow ports, 3646*e* and 3646*f*, and a mounting hole 3646*g*, and includes an internal annular recess 3646*h* at one end, and an external flange 3646*i*, internal annular recess 3646*j*, and internal threaded connection 3646*k* at another end. In an exemplary embodiment, the tubular lower mandrel 3646 is fabricated from aluminum. A sealing element 3648 is received within the inner annular recess 3604*j* of the other end of the tubular upper mandrel 3604 for sealing an interface between the tubular upper mandrel and the tubular lower mandrel 3646.

A tubular sliding sleeve valve 3650 that defines a longitudinal passage 3650*a* and radial flow ports, 3650*b* and 3650*c*, and includes collet fingers 3650*d* at one end for engaging the internal annular recess 3646*h* of the lower tubular mandrel 3646, an external annular recess 3650*e*, an external annular recess 3650*f*, an external annular recess 3650*g*, and circumferentially spaced apart teeth 3650*h* at another end is received within and is slidably coupled to the longitudinal passage 3646*b* of the tubular lower mandrel 3646. In an exemplary embodiment, the tubular sliding sleeve valve 3650 is fabricated from aluminum. A set screw 3652 is mounted within and coupled to the mounting hole 3646*g* of the tubular lower mandrel 3646 that is received within the external annular recess 3650*e* of the tubular sliding sleeve 3650. Sealing elements, 3654 and 3656, are mounted within the external annular recesses, 3650*f* and 3650*g*, respectively, of the tubular sliding sleeve valve 3650 for sealing an interface between the tubular sliding sleeve valve and the tubular lower mandrel 3646.

An end of a tubular outer sleeve 3658 that defines a longitudinal passage 3658*a*, radial passages, 3658*b* and 3658*c*, upper flow ports, 3658*d* and 3658*e*, lower flow ports, 3658*f* and 3658*g*, and radial passages, 3658*h* and 3658*i*, receives, mates with, and is coupled to the other end of the tubular upper mandrel 3604 and an end face of the end of the tubular outer sleeve is positioned proximate and end face of the lower tubular spacer ring 3610. The other end of the tubular outer sleeve 3658 receives, mates with, and is coupled to the other end of the tubular lower mandrel 3646.

An external threaded connection 3660*a* of an end of a tubular bypass mandrel 3660 that defines a longitudinal passage 3660*b*, upper flow ports, 3660*c* and 3660*d*, lower flow ports, 3660*e* and 3660*f*, and a mounting hole 3660*g* and includes an internal annular recess 3660*h* and an external threaded connection 3660*i* at another end is received within and coupled to the internal threaded connection 3646*k* of the tubular lower mandrel 3646. A sealing element 3662 is received within the internal annular recess 3646*j* of the tubular lower mandrel 3646 for sealing an interface between the tubular lower mandrel and the tubular bypass mandrel 3660.

A tubular plug seat 3664 that defines a longitudinal passage 3664*a* having a tapered opening 3664*b* at one end, and flow ports, 3664*c* and 3664*d*, and includes an external annular recess 3664*e*, an external annular recess 3664*f*, an external annular recess 3664*g*, an external annular recess 3664*h*, and an external annular recess 3664*i* having an external threaded connection at another end is received within and is movably coupled to the longitudinal passage 3660*b* of the tubular bypass mandrel 3660. A tubular nose 3666 is threadably coupled to and mounted upon the external annular recess 3664*i* of the tubular plug seat 3664. In an exemplary embodiment, the tubular plug seat 3664 is fabricated from aluminum. Sealing elements, 3668, 3670, and 3672, are received within the external annular recesses, 3664*e*, 3664*g*, and 3664*h*, respectively, of the tubular plug seat 3664 for sealing an interface between the tubular plug seat and the tubular bypass mandrel 3660. A set screw 3674 is mounted within and coupled to the mounting hole 3660*g* of the tubular bypass mandrel 3660 that is received within the external annular recess 3664*f* of the tubular plug seat 3664.

An end of a tubular bypass sleeve 3676 that defines a longitudinal passage 3676*a* and includes an internal annular recess 3676*b* at one end and an internal threaded connection 3676*c* at another end is coupled to the other end of the tubular outer sleeve 3658 and mates with and receives the tubular bypass mandrel 3660. In an exemplary embodiment, the tubular bypass sleeve 3676 is fabricated from aluminum.

An external threaded connection 3678*a* of a tubular valve seat 3678 that defines a longitudinal passage 3678*b* including a valve seat 3678*c* and upjet flow ports, 3678*d* and 3678*e*, and includes a spring retainer 3678*f* and an external annular recess 3678*g* is received within and is coupled to the internal threaded connection 3676*c* of the tubular bypass sleeve 3676. In an exemplary embodiment, the tubular valve seat 3678 is fabricated from aluminum. A sealing element 3680 is received within the external annular recess 3678*g* of the tubular valve seat 3678 for fluidicly sealing an interface between the tubular valve seat and the tubular bypass sleeve 3676.

A poppet valve 3682 mates with and is positioned within the valve seat 3678*c* of the tubular valve seat 3678. An end of the poppet valve 3682 is coupled to an end of a stem bolt 3684 that is slidingly supported for longitudinal displacement by the spring retainer 3678*f* A valve spring 3686 that surrounds a portion of the stem bolt 3684 is positioned in opposing relation to the head of the stem bolt and a support 3678*f* a of the spring retainer 3678*f*, for biasing the poppet valve 3682 into engagement with the valve seat 3678*c* of the tubular valve seat 3678.

An end of a composite nose 3688 that defines a longitudinal passage 3688*a* and mounting holes, 3688*b* and 3688*c*, and includes an internal threaded connection 3688*d* at another end receives, mates with, and is coupled to the other end of the tubular valve seat 3678. A tubular nose sleeve 3690 that defines mounting holes, 3690*a* and 3690*b*, is coupled to the composite nose 3688 by shear pins, 3692*a* and 3692*b*, that are mounted in and coupled to the mounting holes, 3688*b* and 3690*a*, and, 3688*c* and 3690*b*, respectively, of the composite nose and tubular nose sleeve, respectively.

An external threaded connection 3694*a* of a baffle nose 3694 that defines longitudinal passages, 3694*b* and 3694*c*, is received within and is coupled to the internal threaded connection internal threaded connection 3688*d* of the composite nose 3688.

In an exemplary embodiment, as illustrated in FIGS. 19A1 to 19A5, during the operation of the packer setting tool assembly 32 and packer assembly 36, the packer setting tool and packer assembly are coupled to one another by inserting the end of the tubular upper adaptor 3602 into the other end of the tubular coupling ring 3244, bringing the circumferentially spaced teeth 3216*g* of the other end of the tubular bushing 3216 into engagement with the circumferentially spaced teeth 3602*e* of the end of the tubular upper adaptor, and mounting shear pins, 36100*a* and 36100*b*, within the mounting holes, 3244*c* and 3602*c*, and, 3244*d* and 3602*d*, respectively, of the tubular coupling ring and tubular upper adaptor, respectively. As a result, the tubular mandrel 3206 and tubular stinger 3208 of the packer setting tool assembly 32 are thereby positioned within the longitudinal passage 3604*a* of the tubular upper mandrel 3604 with the 3208*e* of the tubular stinger positioned within the longitudinal passage 3646*b* of the tubular lower mandrel 3646 proximate the collet fingers 3650*d* of the tubular sliding sleeve valve 3650.

Furthermore, in an exemplary embodiment, during the operation of the packer setting tool 32 and packer assembly 36, as illustrated in FIGS. 20A1 to 20A5, the packer setting tool and packer assembly are positioned within the expandable wellbore casing 100 and an internal threaded connection 30*a* of an end of the adjustable casing expansion cone assembly 30 receives and is coupled to the external threaded connection 3202*f* of the end of the tubular adaptor 3202 of the packer setting tool assembly. Furthermore, shear pins, 36102*a* and 36102*b*, mounted within the mounting holes, 3658*b* and 3658*c*, of the tubular outer sleeve 3658 couple the tubular outer sleeve to the expandable wellbore casing. As a result, torsion loads may transferred between the tubular outer sleeve 3658 and the expandable wellbore casing 100.

In an exemplary embodiment, as illustrated in FIGS. 20B1 to 20B5, a conventional plug 36104 is then injected into the setting tool assembly 32 and packer assembly 36 by injecting a fluidic material 36106 into the setting tool assembly and packer assembly through the longitudinal passages, 3202*a*, 3204*b*, 3206*b*, 3208*b*, 3650*a*, 3646*a*, 3660*b*, and 3664*a* of the tubular adaptor 3202, tubular upper mandrel 3204, tubular mandrel 3206, tubular stinger 3208, tubular sliding sleeve valve 3650, tubular lower mandrel 3646, tubular bypass mandrel 3660, and tubular plug seat 3664, respectively. The plug 36104 is thereby positioned within the longitudinal passage 3664*a* of the tubular plug seat 3664. Continued injection of the fluidic material 36106 following the seating of the plug 1606 within the longitudinal passage 3664*a* of the tubular plug seat 3664 causes the plug and the tubular plug seat to be displaced downwardly in a direction 36108 until further movement of the tubular plug seat is prevented by interaction of the set screw 3674 with the external annular recess 3664*f* of the tubular plug seat. As a result, the flow ports, 3664*c* and 3664*d*, of the tubular plug seat 3664 are moved out of alignment with the upper flow ports, 3660*c* and 3660*d*, of the tubular bypass mandrel 3660.

In an exemplary embodiment, as illustrated in FIGS. 20C1 to 20C5, after the expandable wellbore casing 100 has been radially expanded and plastically deformed to form at least the bell section 112 of the expandable wellbore casing 100 thereby shearing the shear pins, 36102*a* and 36102*b*, the setting tool assembly 32 and packer assembly 36 are then moved upwardly to a position within the expandable wellbore casing 100 above the bell section. The tubular adaptor 3202 is then rotated, by rotating the tool string of the system 10 above the setting tool assembly 32, to displace and position the drag blocks, 3228 and 3230, into engagement with the interior surface of the expandable wellbore casing 100.

As a result of the engagement of the drag blocks, 3228 and 3230, with the interior surface of the expandable wellbore casing 100, further rotation of the drag blocks relative to the wellbore casing is prevented. Consequently, due to the operation and interaction of the threaded connections, 3216*d* and 3218*a*, of the tubular bushing 3216 and tubular drag block body 3218, respectively, further rotation of the tubular adaptor 3202 causes the tubular drag block body and setting sleeve 3242 to be displaced downwardly in a direction 36112 relative to the remaining elements of the setting tool assembly 32 and packer assembly 36. As a result, the setting sleeve 3242 engages and displaces the upper tubular spacer ring 3606 thereby shearing the shear pins, 3622*a* and 3622*b*, and driving the upper tubular slip 3612 onto and up the angled end face 3620*d* of the upper tubular wedge 3620 and into engagement with the interior surface of the expandable wellbore casing 100. As a result, longitudinal displacement of the upper tubular slip 3612 relative to the expandable wellbore casing 100 is prevented. Furthermore, as a result, the 3246*b* collet fingers of the tubular retaining collet 3246 are disengaged from the tubular upper adaptor 3602.

In an alternative embodiment, after the drag blocks, 3228 and 3230, engage the interior surface of the expandable wellbore casing 100, an upward tensile force is applied to the tubular support member 12, and the ball gripper assembly 16 is then operate to engage the interior surface of the expandable wellbore casing. The tension actuator assembly 18 is then operated to apply an upward tensile force to the tubular adaptor 3202 thereby pulling the upper tubular spacer ring 3606, lower tubular spacer ring 3610, upper tubular slip 3612, lower tubular slip 3616, upper tubular wedge 3620, lower tubular wedge 3624, upper tubular extrusion limiter 3628, lower tubular extrusion limiter 3634, and central tubular elastomeric element 3644 upwardly into contact with the 3242 thereby compressing the upper tubular spacer ring, lower tubular spacer ring, upper tubular slip, lower tubular slip, upper tubular wedge, lower tubular wedge, upper tubular extrusion limiter, lower tubular extrusion limiter, and central tubular elastomeric element. As a result, the upper tubular slip 3612, lower tubular slip 3616, and central tubular elastomeric element 3644 engage the interior surface of the expandable wellbore casing 100.

In an exemplary embodiment, as illustrated in FIGS. 20D1 to 20D5, an upward tensile force is then applied to the tubular adaptor 3202 thereby compressing the lower tubular slip 3616, lower tubular wedge 3624, central elastomeric packer element 3644, upper tubular extrusion limiter 3628, and upper tubular wedge 3620 between the lower tubular spacer ring 3610 and the stationary upper tubular slip 3612. As a result, the lower tubular slip 3616 is driven onto and up the angled end face 3624*d* of the lower tubular wedge 3624 and into engagement with the interior surface of the expandable wellbore casing 100, and the central elastomeric packer element 3644 is compressed radially outwardly into engagement with the interior surface of the expandable tubular member. As a result, further longitudinal displacement of the upper tubular slip 3612, lower tubular slip 3616, and central elastomeric packer element 3644 relative to the expandable wellbore casing 100 is prevented.

In an exemplary embodiment, as illustrated in FIGS. 20E1 to 20E6, continued application of the upward tensile force to tubular adaptor 3202 will then shear the shear pins, 1602*a* and 1602*b*, thereby disengaging the setting tool assembly 32 from the packer assembly 36.

In an exemplary embodiment, as illustrated in FIGS. 20F1 to 20F6, with the drag blocks, 3228 and 3230, in engagement with the interior surface of the expandable wellbore casing 100, the tubular adaptor 102 is further rotated thereby causing the tubular drag block body 3218 and setting sleeve 3242 to be displaced further downwardly in the direction 36113 until the tubular drag block body and setting sleeve are disengaged from the tubular stinger 3208. As a result, the tubular stinger 3208 of the setting tool assembly 32 may then be displaced downwardly into complete engagement with the tubular sliding sleeve valve 3650.

In an exemplary embodiment, as illustrated in FIGS. 20G1 to 20G6, a fluidic material 36114 is then injected into the setting tool assembly 32 and the packer assembly 36 through the longitudinal passages 3202*a*, 3204*b*, 3206*b*, 3208*b*, 3604*b*, 3650*a*, and 3646*b* of the tubular adaptor 3202, tubular upper mandrel 3204, tubular mandrel 3206, tubular stinger 3208, tubular upper mandrel 3604, tubular sliding sleeve valve 3650, and tubular lower mandrel 3646, respectively. Because, the plug 36104 is seated within and blocks the longitudinal passage 3664*a* of the tubular plug seat 3664, the longitudinal passages 3604*b*, 3650*a*, and 3646*b* of the tubular upper mandrel 3604, tubular sliding sleeve valve 3650, and tubular lower mandrel 3646 are pressurized thereby displacing the tubular upper adaptor 3602 and tubular upper mandrel 3604 downwardly until the end face of the tubular upper mandrel impacts the end face of the upper tubular spacer ring 3606.

In an exemplary embodiment, as illustrated in FIGS. 20H1 to 20H5, the setting tool assembly 32 is brought back into engagement with the packer assembly 36 until the engagement shoulder 3208*e* of the other end of the tubular stinger 3208 engages the collet fingers 3650*d* of the end of the tubular sliding sleeve valve 3650. As a result, further downward displacement of the tubular stinger 3208 displaces the tubular sliding sleeve valve 3650 downwardly until the radial flow ports, 3650*b* and 3650*c*, of the tubular sliding sleeve valve are aligned with the flow ports, 3646*e* and 3646*f*, of the tubular lower mandrel 3646. A hardenable fluidic sealing material 36116 may then be injected into the setting tool assembly 32 and the packer assembly 36 through the longitudinal passages 3202*a*, 3204*b*, 3206*b*, 3208*b*, and 3650*a* of the tubular adaptor 3202, tubular upper mandrel 3204, tubular mandrel 3206, tubular stinger 3208, and tubular sliding sleeve valve 3650, respectively. The hardenable fluidic sealing material may then flow out of the packer assembly 36 through the upper flow ports, 3658*d* and 3658*e*, into the annulus between the expandable wellbore casing 100 and the wellbore 102.

The tubular sliding sleeve valve 3650 may then be returned to its original position, with the radial flow ports, 3650*b* and 3650*c*, of the tubular sliding sleeve valve out of alignment with the flow ports, 3646*e* and 3646*f*, of the tubular lower mandrel 3646. The hardenable fluidic sealing material 36116 may then be allowed to cure before, during, or after the continued operation of the system 10 to further radially expand and plastically deform the expandable wellbore casing.

Figure 21:
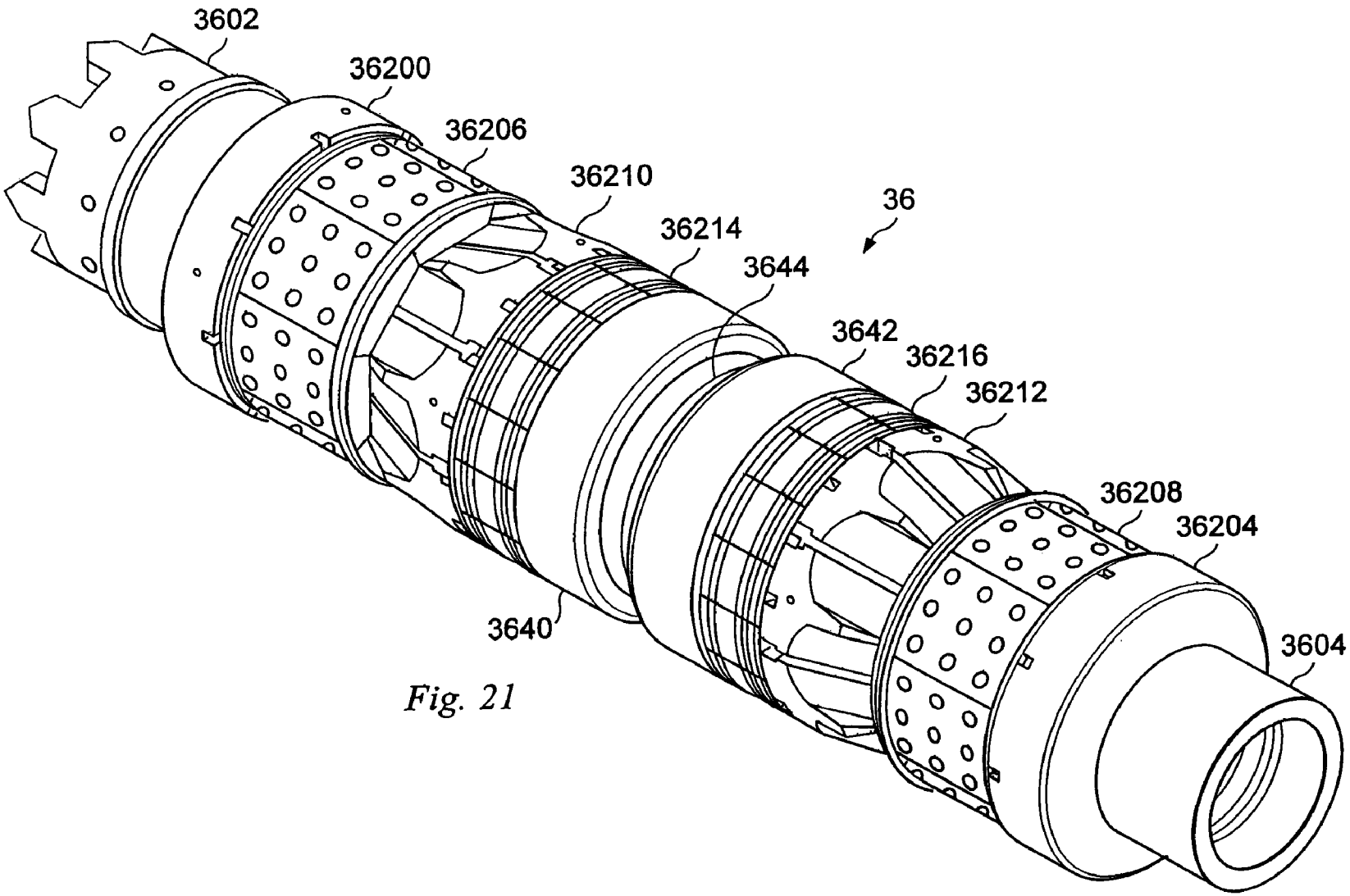
FIGS. 21 and 21A to 21AX are fragmentary perspective and cross-sectional illustrations of an alternative embodiment of the packer assembly.

In an alternative embodiment, as illustrated in FIGS. 21 and 21 A to 21 AX, the packer assembly 36 includes an upper tubular spacer ring 36200 receives and mates with the end of the tubular upper mandrel 3604 and includes an angled end face 36200*a* that includes a plurality of spaced apart radial grooves 36200*b* and another end face that is positioned proximate to an end face of the tubular upper adaptor 3602 is coupled to the tubular upper mandrel by shear pins, 36202*a*, 36202*b*, 36202*c*, and 36202*d*. A lower tubular spacer ring 36204 that includes an angled end face 36204*a* that includes a plurality of spaced apart radial grooves 36204*b* receives, mates, and is coupled to the other end of the tubular upper mandrel 3604 and includes another end face that is positioned proximate to an end face of the external flange 3604*i* of the tubular upper mandrel 3604. In an exemplary embodiment, the upper and tubular spacer rings, 3606 and 3610, are fabricated from a composite material.

An upper tubular slip assembly 36206 that receives and is movably mounted upon the tubular upper mandrel 3604 includes a plurality of substantially identical slip elements 36206*a* that each include an exterior arcuate cylindrical surface 36206*aa* including mounting holes, 36206*ab*, 36206*ac*, 36206*ad*, 36206*ae*, 36206*af*, 36206*ag*, 36206*ah*, 36206*ai*, and 36206*aj*, and grooves, 36206*aj* and 36206*ak*, a front end face 36206*al*, a rear end face 36206*am* including a mounting hole 36206*an*, side faces, 36206*ao* and 36206*ap*, an interior arcuate cylindrical surface 36206*aq* that mates with the exterior surface of the tubular upper mandrel 3604, and an interior tapered surface 36206*ar* including a mounting hole 36206*as*. Mounting pins 36206*at* are received within and coupled to the mounting holes 36206*an* and are received within corresponding radial grooves 36200*b* of the angled end face 36200*a* of the upper tubular spacer ring 36200. Retaining pins 36206*au* are mounted within and coupled to the mounting holes 36206*as* that include heads 36206*av*. Slip retaining bands, 36206*aw* and 36206*ax*, are received within and coupled to grooves, 36206*aj* and 36206*ak*, respectively, of the slip elements 36206*a*. Slip gripping elements, 36206*ay*, 36206*az*, 36206*aaa*, 36206*aab*, 36206*aac*, 36206*aad*, 36206*aae*, 36206*aaf*, and 36206*aag*, are mounted within, coupled to, and extend out of the mounting holes, 36206*ab*, 36206*ac*, 36206*ad*, 36206*ae*, 36206*af*, 36206*ag*, 36206*ah*, 36206*ai*, and 36206*aj*, respectively. In an exemplary embodiment, the adjacent exterior arcuate cylindrical surfaces 36206*aa* of the identical slip elements 36206*a* of the upper tubular slip assembly 36206 together define a substantially contiguous cylindrical surface.

A lower tubular slip assembly 36208 that receives and is movably mounted upon the tubular upper mandrel 3604 includes a plurality of substantially identical slip elements 36208*a* that each include an exterior arcuate cylindrical surface 36208*aa* including mounting holes, 36208*ab*, 36208*ac*, 36208*ad*, 36208*ae*, 36208*af*, 36208*ag*, 36208*ah*, 36208*ai*, and 36208*aj*, and grooves, 36208*aj* and 36208*ak*, a front end face 36208*al*, a rear end face 36208*am* including a mounting hole 36208*an*, side faces, 36208*ao* and 36208*ap*, an interior arcuate cylindrical surface 36208*aq* that mates with the exterior surface of the tubular upper mandrel 3604, and an interior tapered surface 36208*ar* including a mounting hole 36208*as*. Mounting pins 36208*at* are received within and coupled to the mounting holes 36208*an* and are received within corresponding radial grooves 36204*b* of the angled end face 36204*a* of the lower tubular spacer ring 36204. Retaining pins 36208*au* are mounted within and coupled to the mounting holes 36208*as* that include heads 36208*a* v. Slip retaining bands, 36208*aw* and 36208*ax*, are received within and coupled to grooves, 36208*aj* and 36208*ak*, respectively, of the slip elements 36208*a*. Slip gripping elements, 36208*ay*, 36208*az*, 36208*aaa*, 36208*aab*, 36208*aac*, 36208*aad*, 36208*aae*, 36208*aaf*, and 36208*aag*, are mounted within, coupled to, and extend out of the mounting holes, 36208*ab*, 36208*ac*, 36208*ad*, 36208*ae*, 36208*af*, 36208*ag*, 36208*ah*, 36208*ai*, and 36208*aj*, respectively. In an exemplary embodiment, the adjacent exterior arcuate cylindrical surfaces 36208*aa* of the identical slip elements 36208*a* of the upper tubular slip assembly 36208 together define a substantially contiguous cylindrical surface.

An upper tubular wedge 36210 that receives the tubular upper mandrel 3604 includes an angled front end face 36210*a* including spaced apart radial grooves 36210*b*, a rear end face 36210*c*, an exterior cylindrical surface 36210*d*, a plurality of spaced apart faceted tapered exterior surface segments 36210*e* that mate with corresponding tapered internal surfaces 36206*ar* of corresponding slip elements 36206*a* of the upper tubular slip assembly 36206, and T-shaped exterior grooves 36210*f* aligned with the midline of corresponding faceted tapered exterior surface segments that extend from the angled end face to the rear end face that receive and mate with corresponding retaining pins 36206*au* of corresponding slip elements of the upper tubular slip assembly. The upper tubular wedge 36210 is releasably coupled to the tubular upper mandrel 3604 by shear pins 36211.

A lower tubular wedge 36212 that receives the tubular upper mandrel 3604 includes an angled front end face 36212*a* including spaced apart radial grooves 36212*b*, a rear end face 36212*c*, an exterior cylindrical surface 36212*d*, a plurality of spaced apart faceted tapered exterior surface segments 36212*e* that mate with corresponding tapered internal surfaces 36208*ar* of corresponding slip elements 36208*a* of the upper tubular slip assembly 36208, and T-shaped exterior grooves 36212*f* aligned with the midline of corresponding faceted tapered exterior surface segments that extend from the angled end face to the rear end face that receive and mate with corresponding retaining pins 36208*au* of corresponding slip elements of the lower tubular slip assembly. The lower tubular wedge 36212 is releasably coupled to the tubular upper mandrel 3604 by shear pins 36213.

An upper tubular extrusion limiter assembly 36214 that receives and is movably mounted upon the tubular upper mandrel 3604 includes a plurality of substantially identical extrusion limiter elements 36214*a* that each include an angled front end face 36214*aa* having a recessed portion 36214*ab*, an angled rear end face 36214*ac* that defines a mounting hole 36214*ad*, an interior arcuate cylindrical surface 36214*ae* that mates with the tubular upper mandrel, and an exterior arcuate cylindrical surface 36214*af* including grooves, 36214*ag*, 36214*ah*, and 36214*ai*. Disk extrusion preventers 36214*aj* are mounted within and coupled to the recessed portions 36214*ab* of adjacent extrusion limiter elements 36214*a*, and mounting pins 36214*ak* are mounted within and coupled to mounting holes 36214*ad* of corresponding extrusion limiter elements 36214*a* that are received within corresponding radial grooves 36210*b* of the front end face 36210*a* of the upper tubular wedge 36210. Retaining bands, 36214*al*, 36214*am*, and 36214*an*, are positioned within and coupled to the grooves, 36214*ai*, 36214*ah*, and 36214*ag*, respectively, of the extrusion limiter elements 36214*a*.

A lower tubular extrusion limiter assembly 36216 that receives and is movably mounted upon the tubular upper mandrel 3604 includes a plurality of substantially identical extrusion limiter elements 36216*a* that each include an angled front end face 36216*aa* having a recessed portion 36216*ab*, an angled rear end face 36216*ac* that defines a mounting hole 36216*ad*, an interior arcuate cylindrical surface 36216*ae* that mates with the tubular upper mandrel, and an exterior arcuate cylindrical surface 36216*af* including grooves, 36216*ag*, 36216*ah*, and 36216*ai*. Disk extrusion preventers 36216*aj* are mounted within and coupled to the recessed portions 36216*ab* of adjacent extrusion limiter elements 36216*a*, and mounting pins 36216*ak* are mounted within and coupled to mounting holes 36216*ad* of corresponding extrusion limiter elements 36216*a* that are received within corresponding radial grooves 36212*b* of the front end face 36212*a* of the lower tubular wedge 36212. Retaining bands, 36216*al*, 36216*am*, and 36216*an*, are positioned within and coupled to the grooves, 36216*ag*, 36216*ah*, and 36216*ai*, of the extrusion limiter elements 36216*a*.

The angled end face 3640*b* of the upper tubular elastomeric packer element 3640 mates with and is positioned proximate the angled end faces 36214*aa* and disk extrusion preventers 36214*aj* of the extrusion limiter elements 36214*a* of the upper tubular extrusion limiter assembly 36214, and the angled end face 3642*b* of the lower tubular elastomeric packer element 3642 mates with and is positioned proximate the angled end faces 36216*aa* and disk extrusion preventers 36216*aj* of the extrusion limiter elements 36216*a* of the lower tubular extrusion limiter assembly 36216.

Figure 21A:
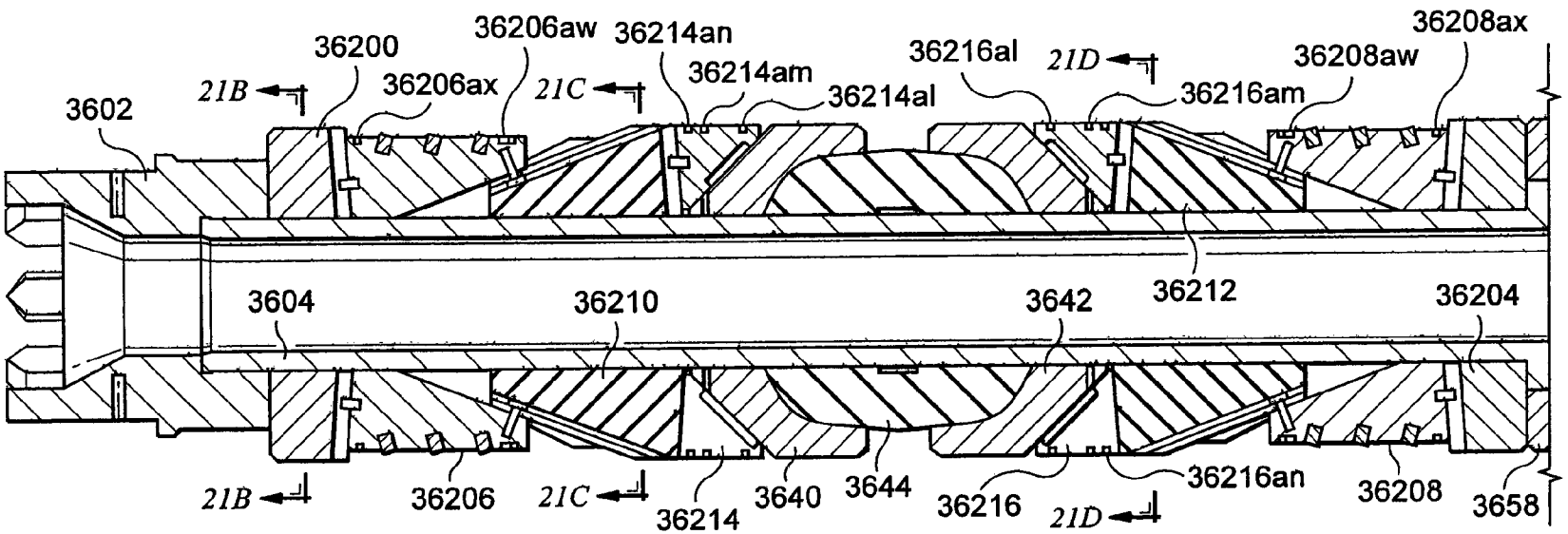
Figure 21B:
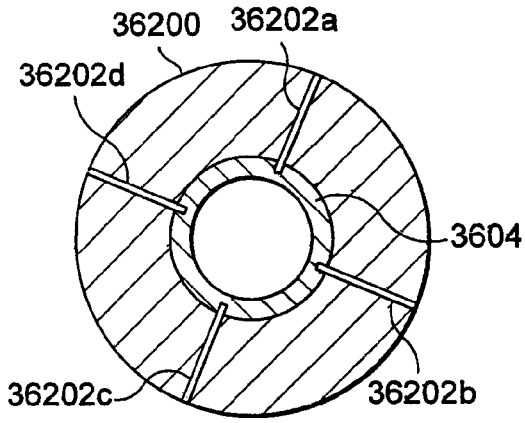
Figure 21C:
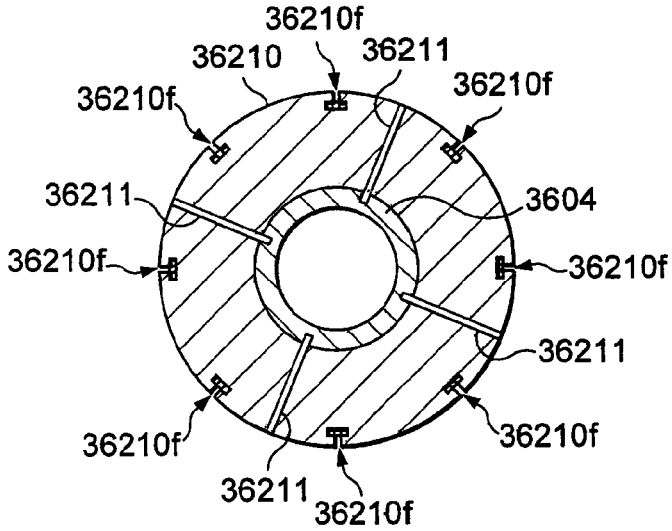
Figure 21D:
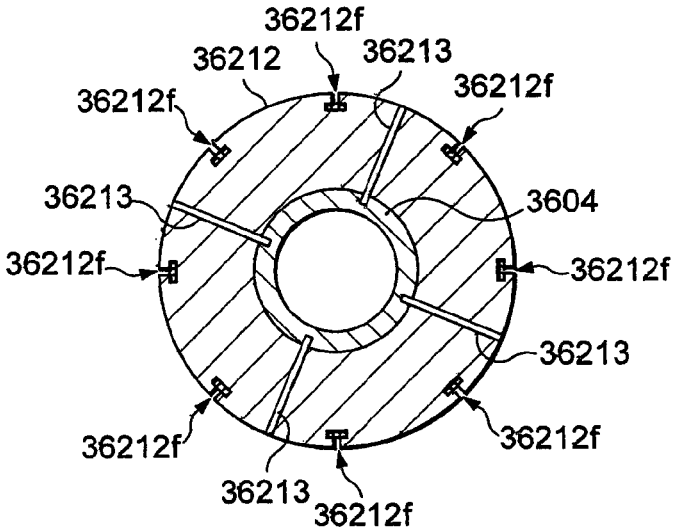
Figure 21E:
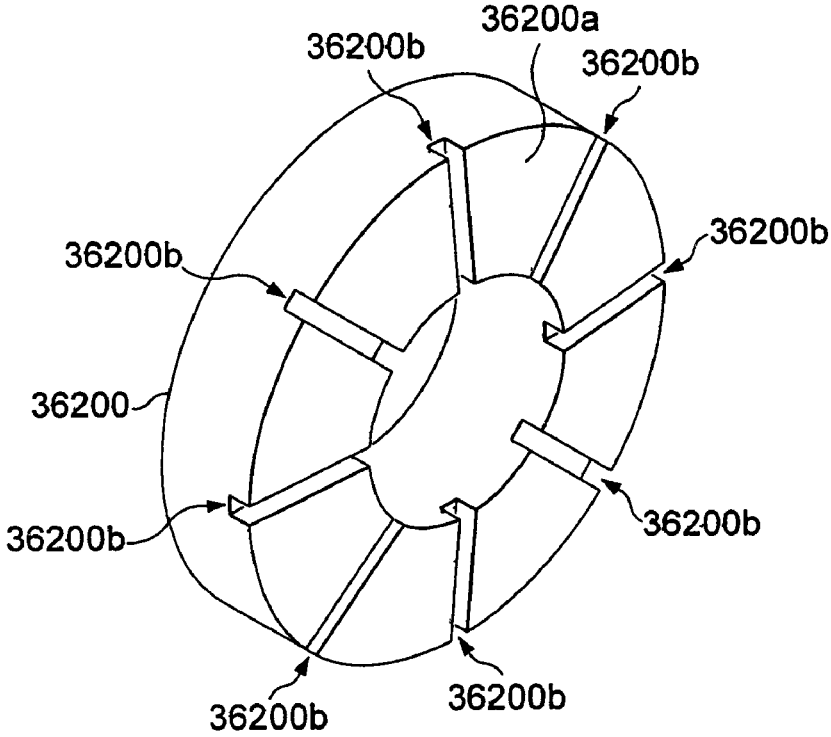
Figure 21H:
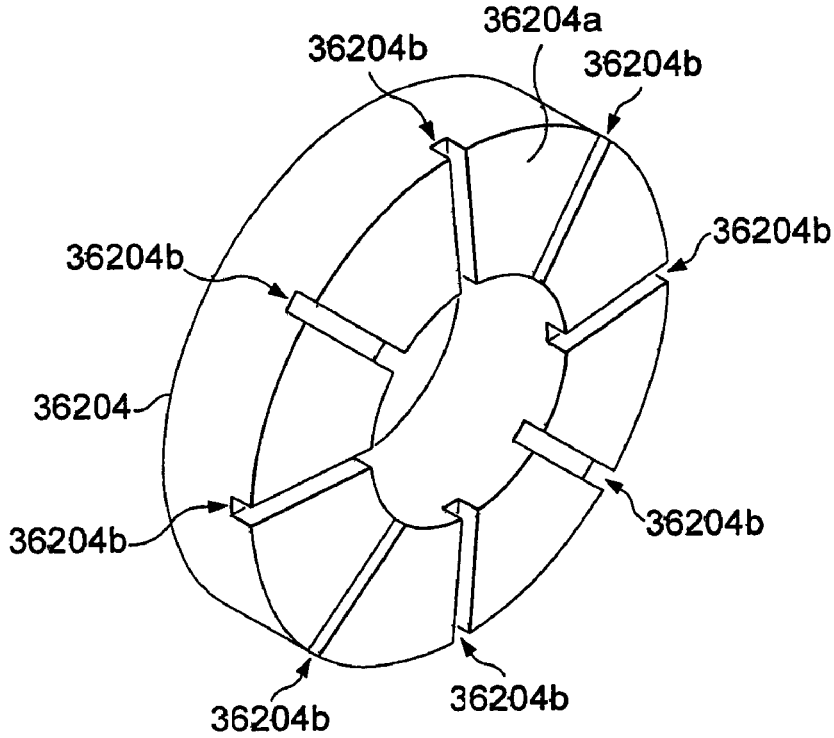
Figure 21G:
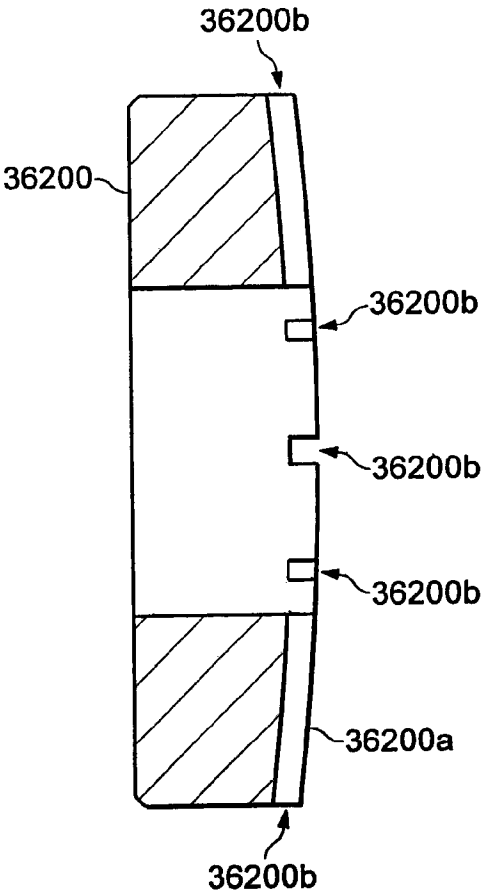
Figure 21F:
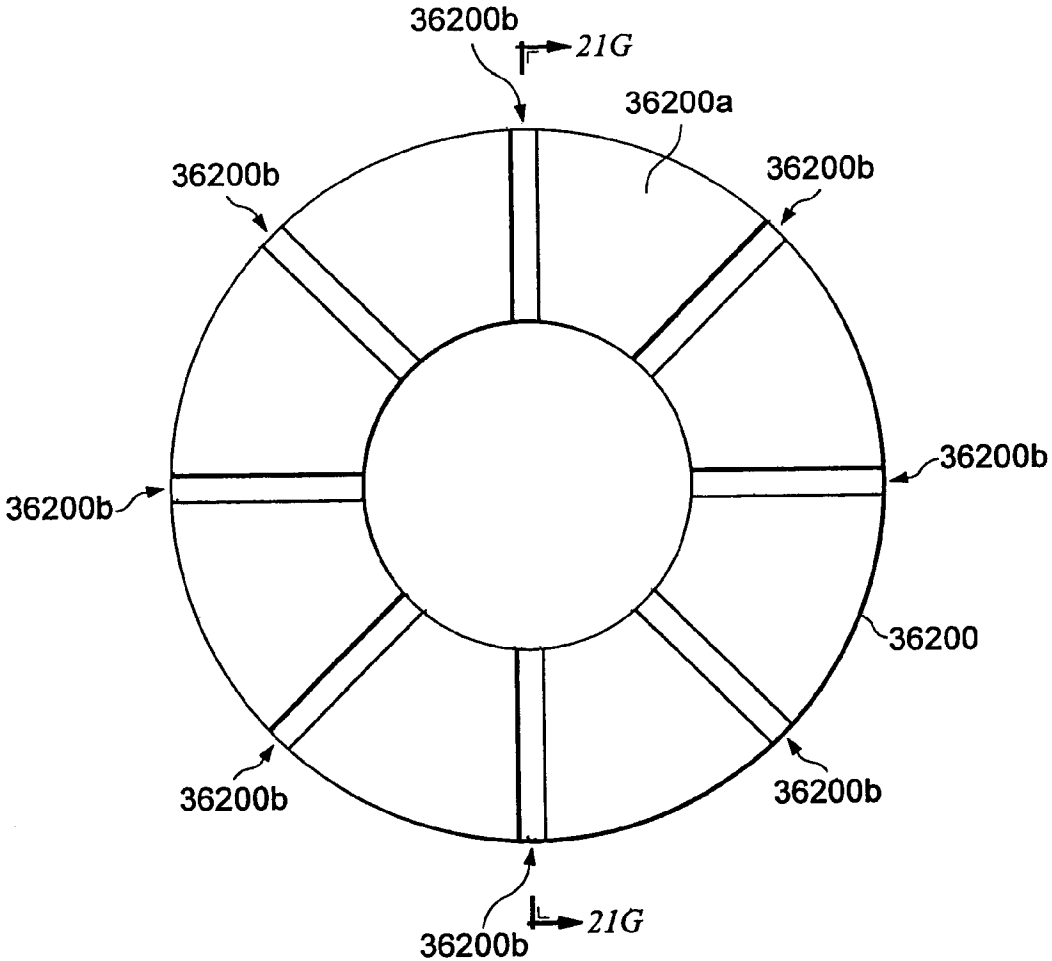
Figure 21J:
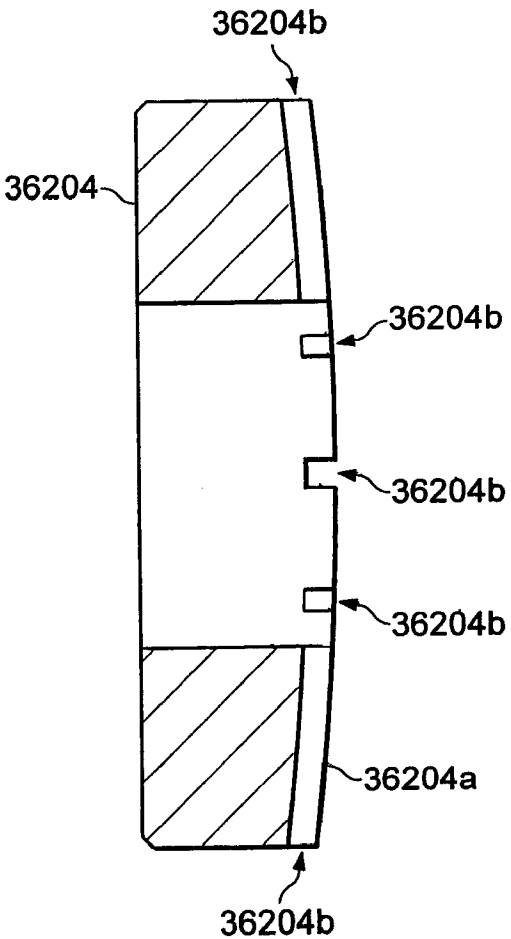
Figure 21I:
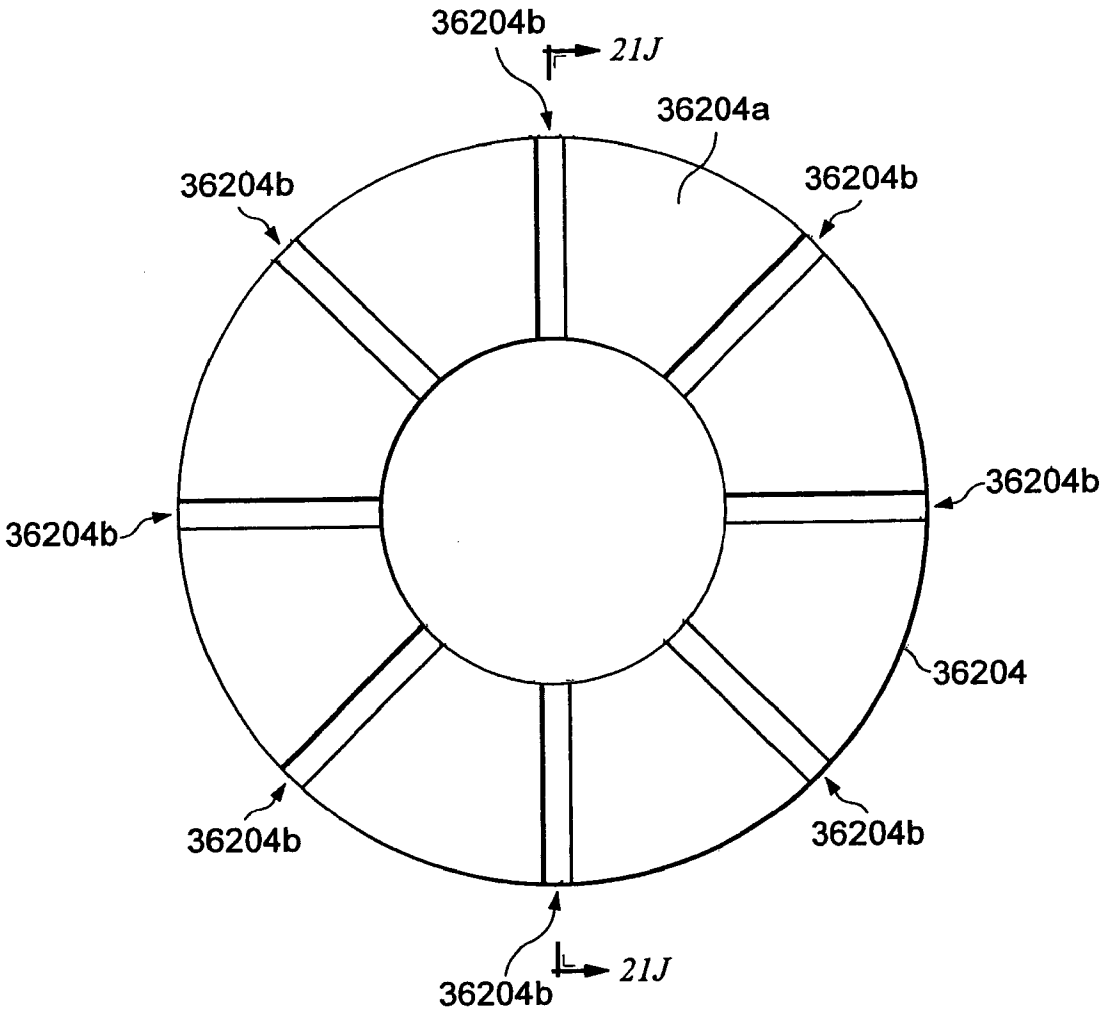
Figure 21K:
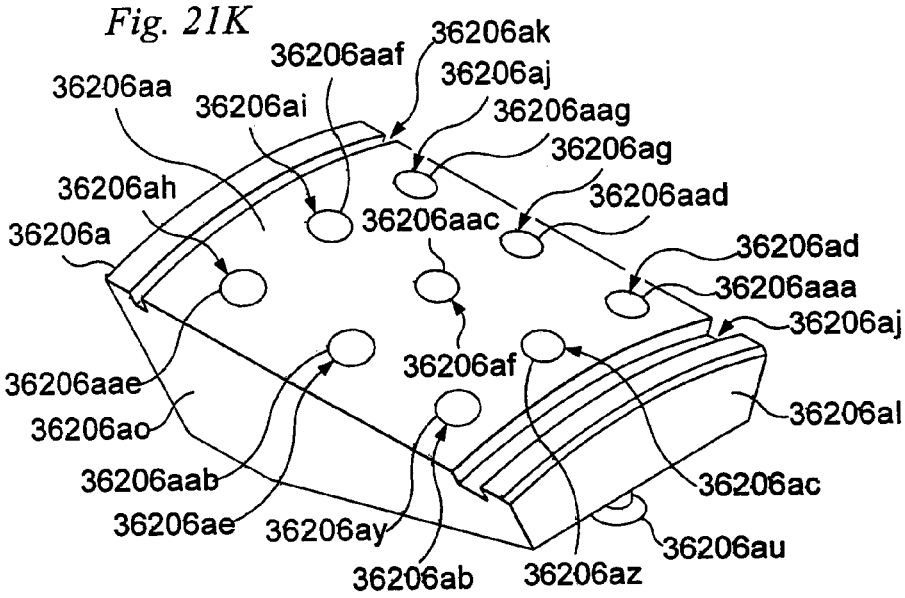
Figure 21L:
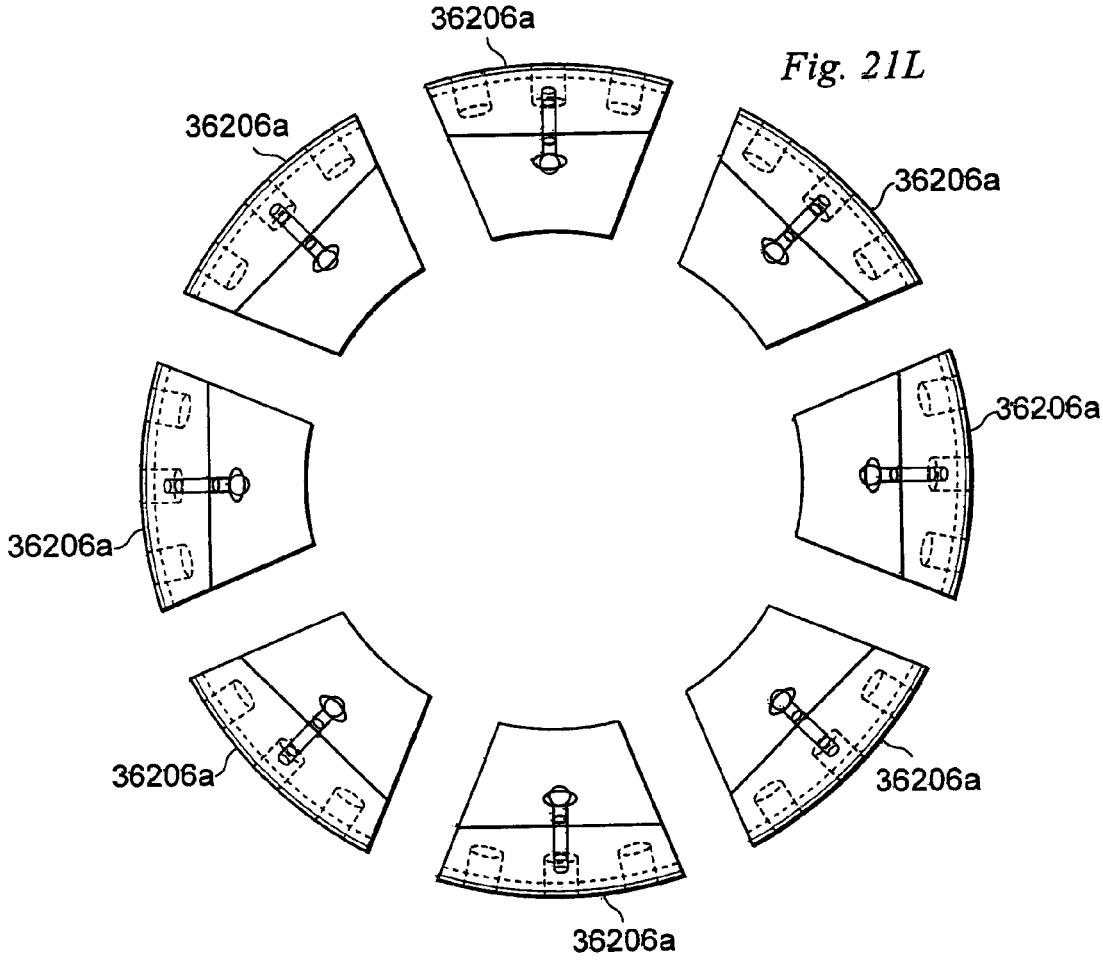
Figure 21M:
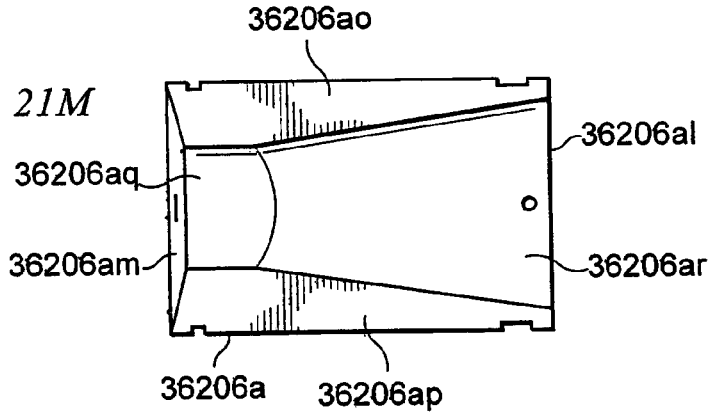
Figure 21N:
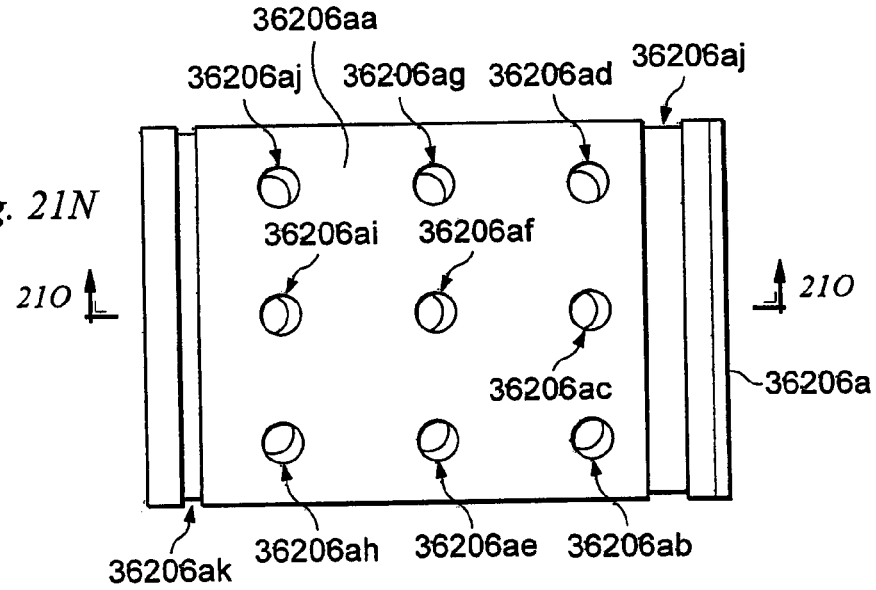
Figure 21O:
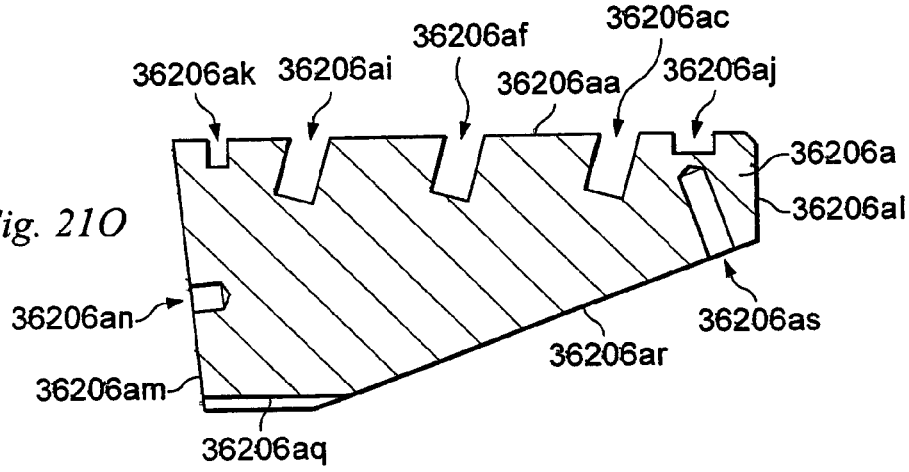
Figure 21P:
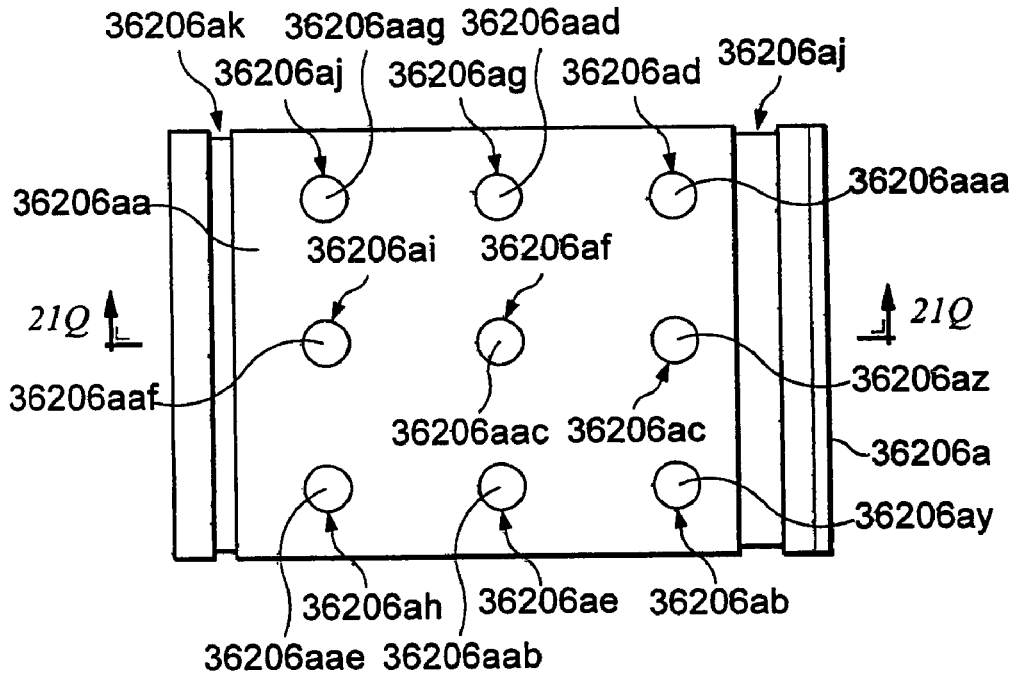
Figure 21Q:
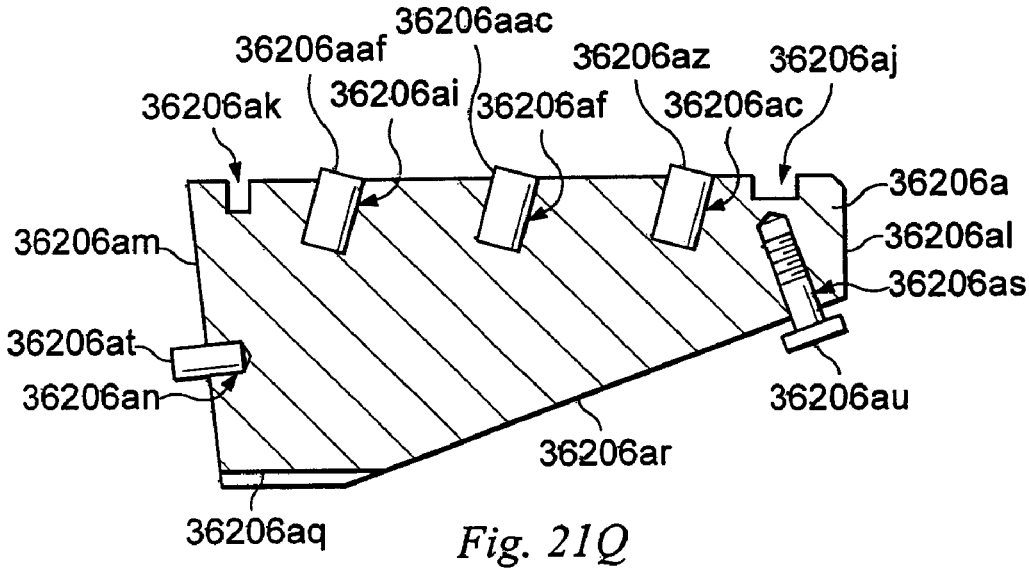
Figure 21R:
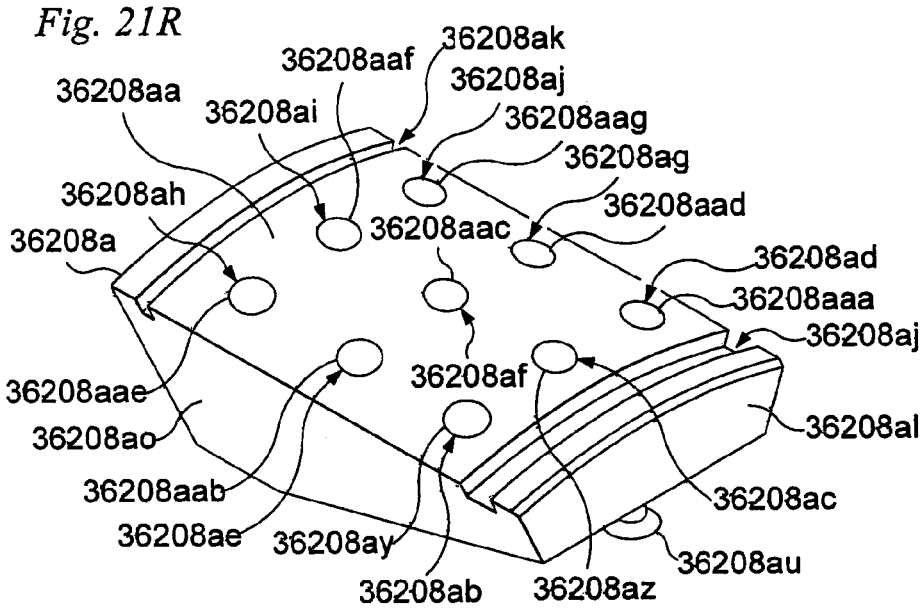
Figure 21S:
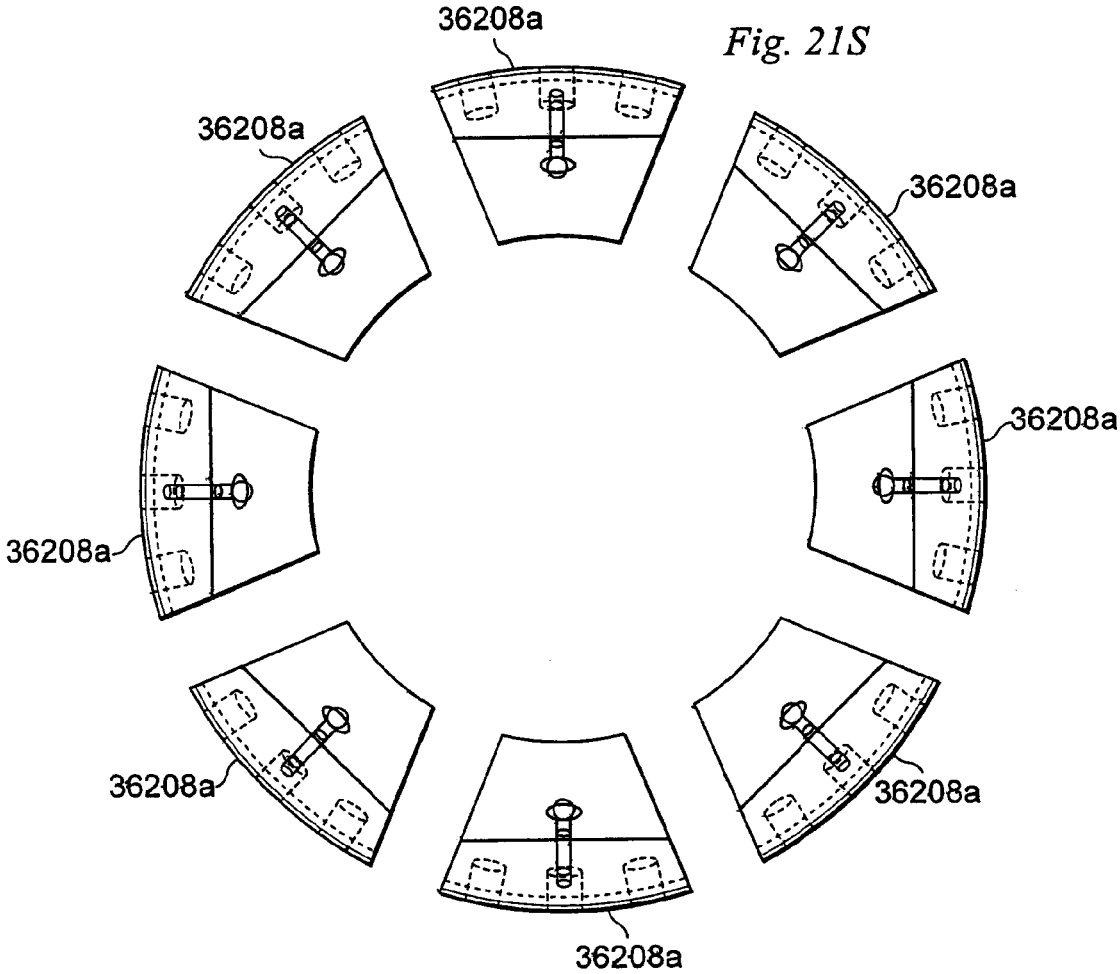
Figure 21T:
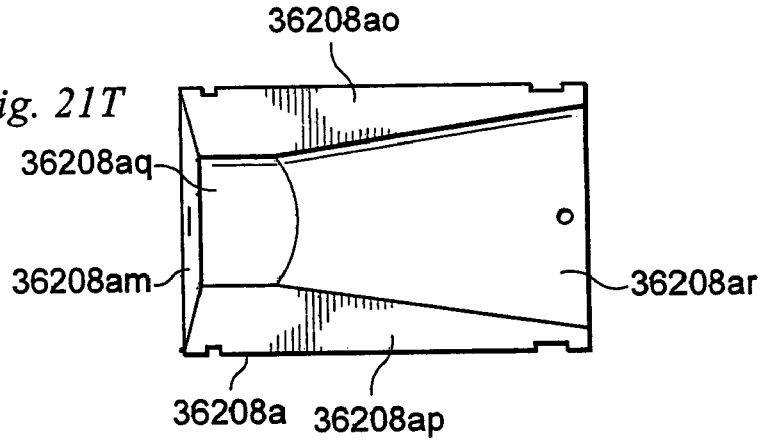
Figure 21U:
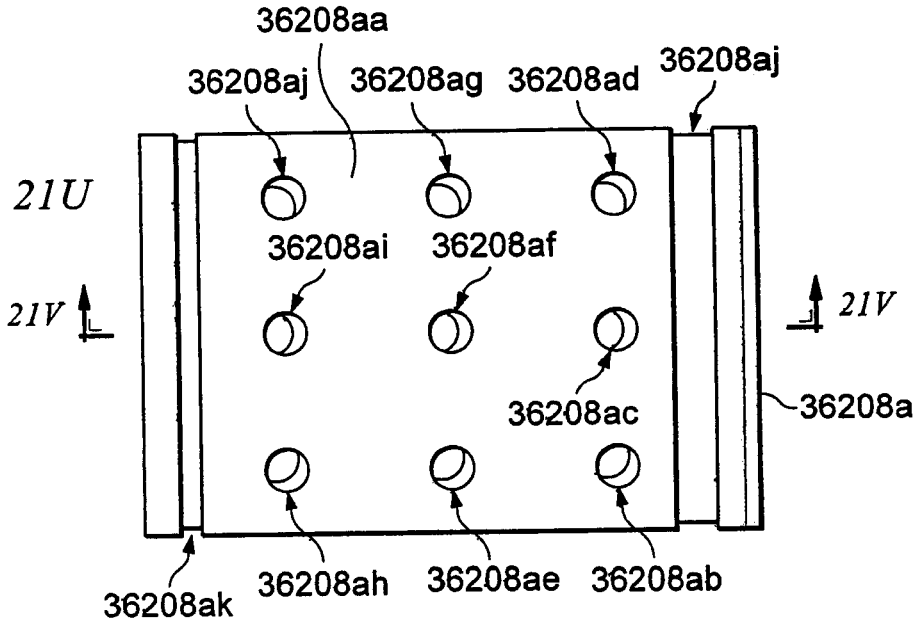
Figure 21V:
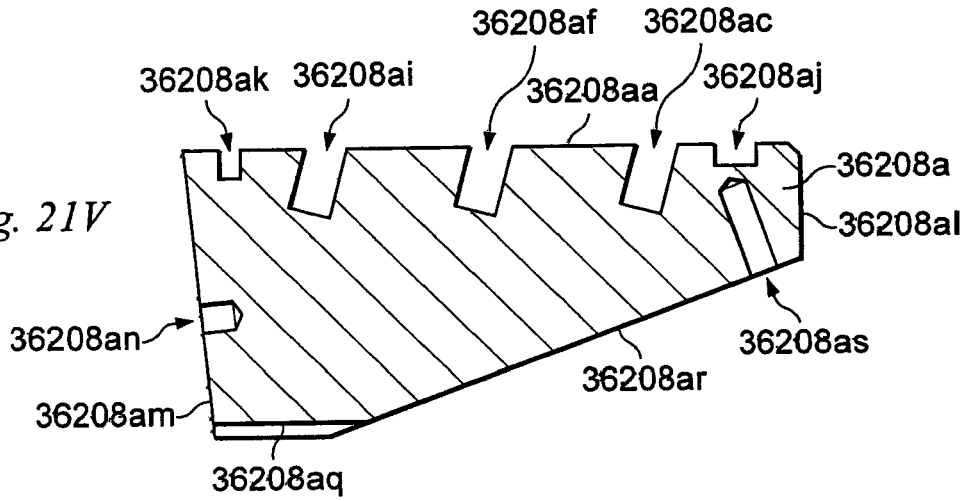
Figure 21W:
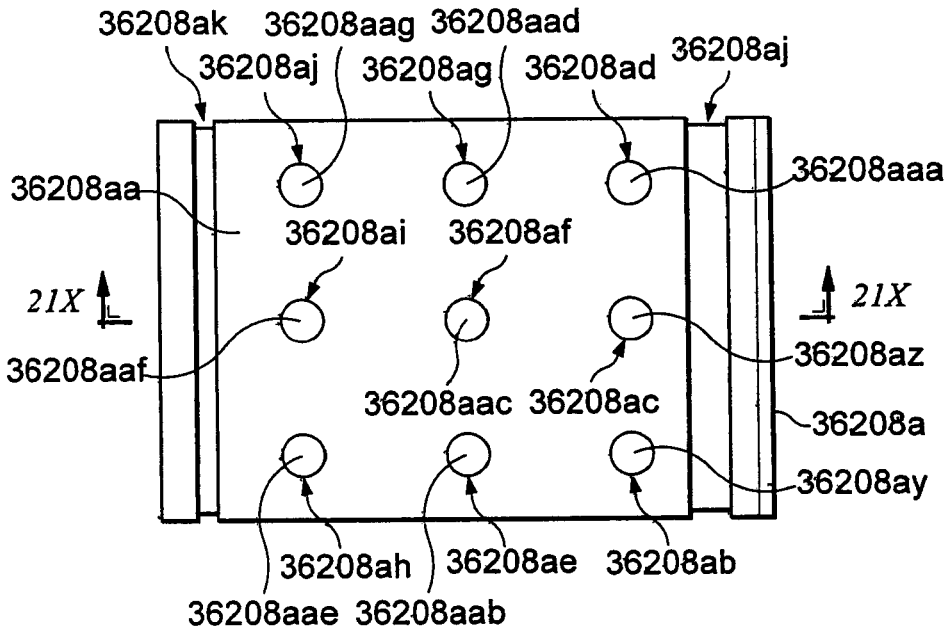
Figure 21X:
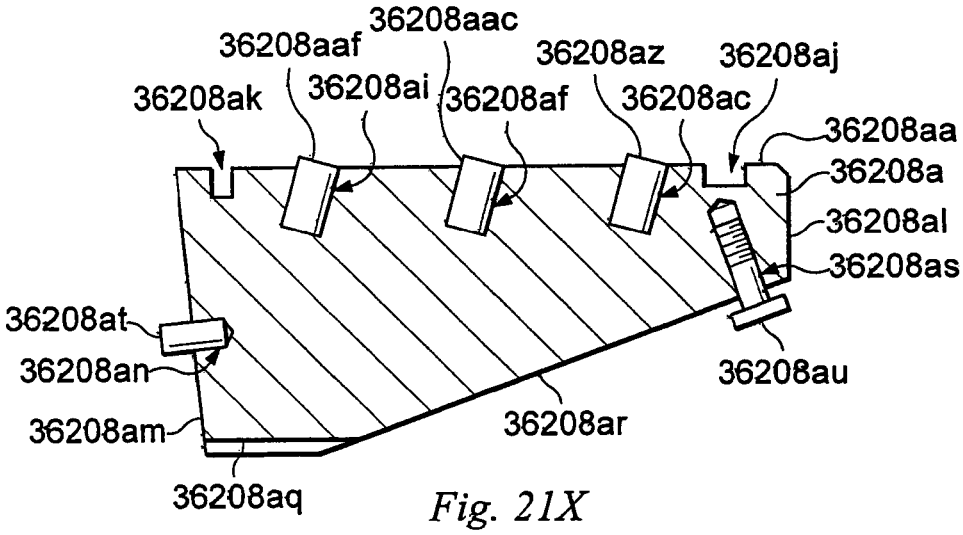
Figure 21Y:
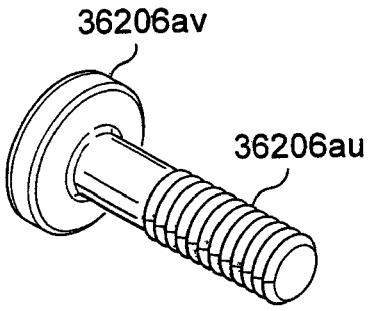
Figure 21Z:
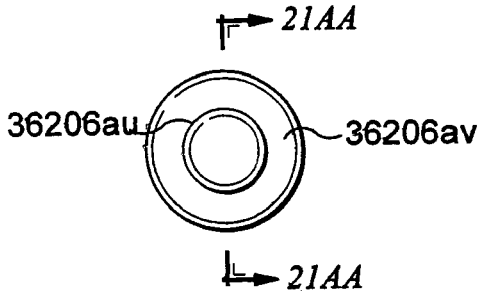
Figure 21A:
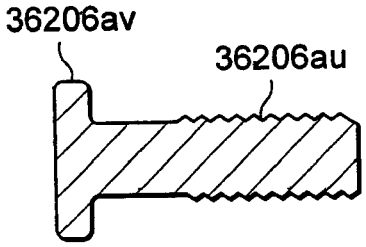
Figure 21A:
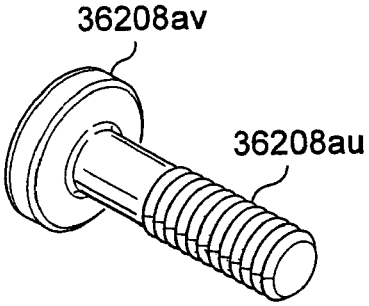
Figure 21A:
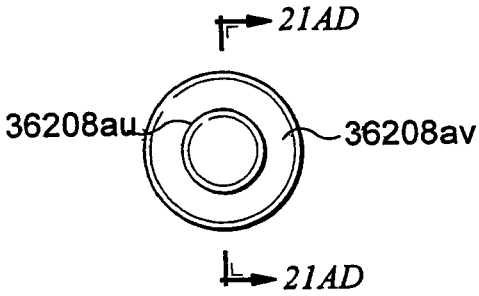
Figure 21A:
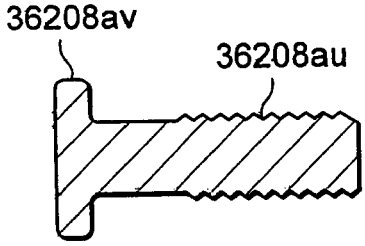
Figure 21A:
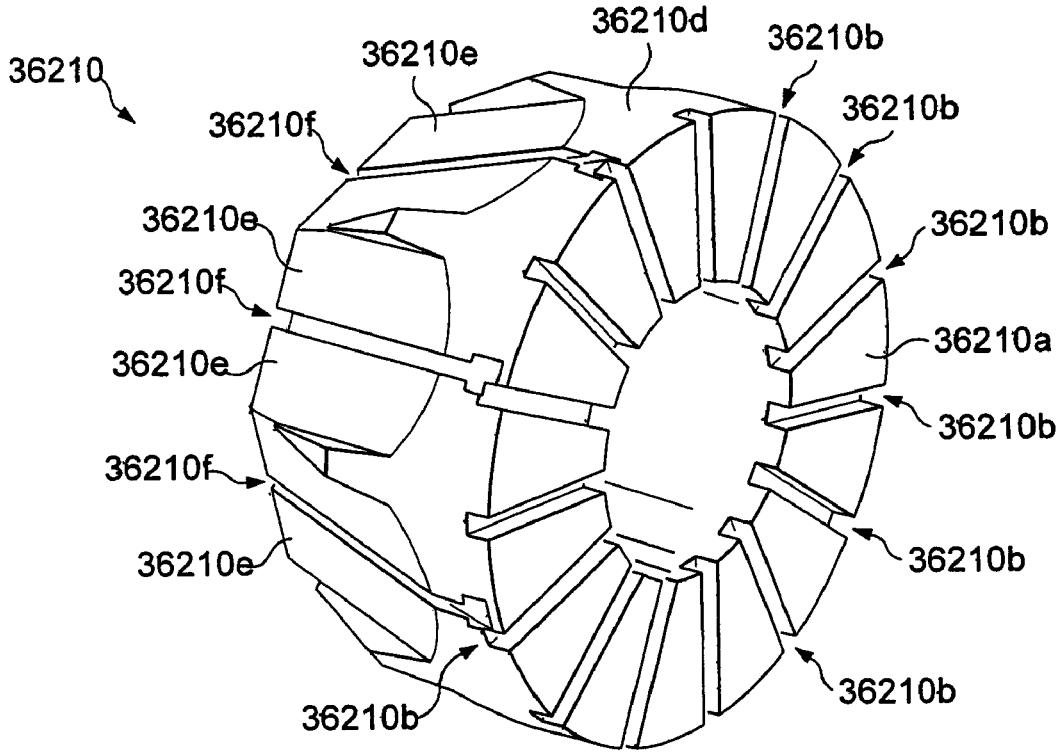
Figure 21A:
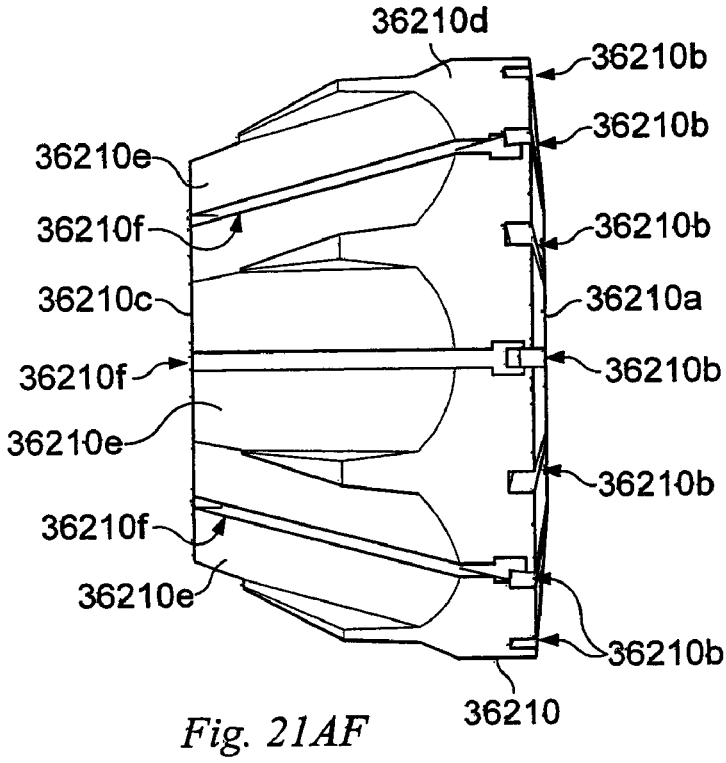
Figure 21A:
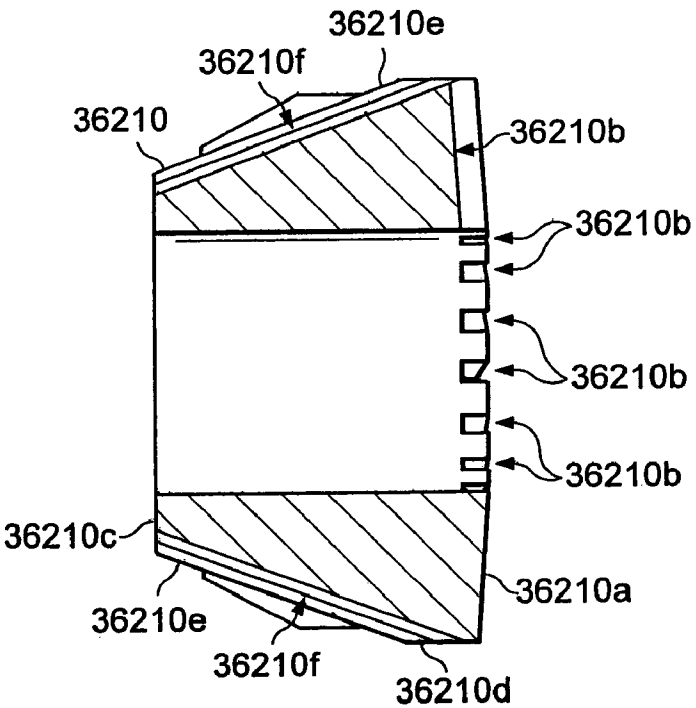
Figure 21A:
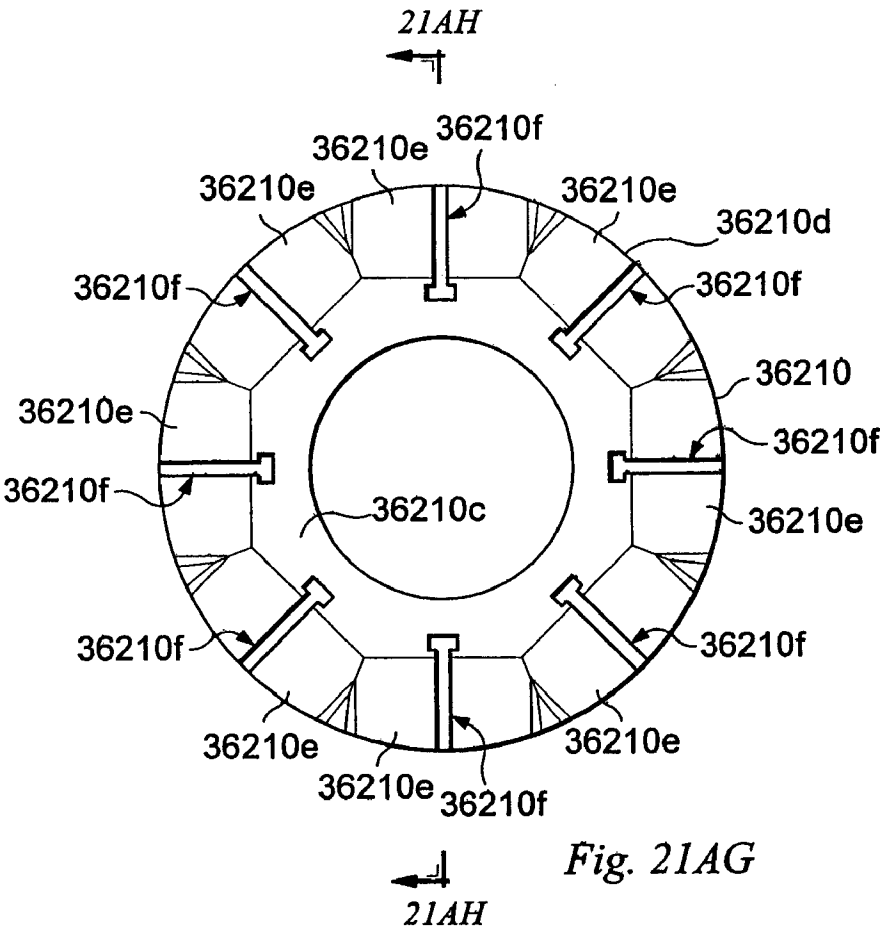
Figure 21A:
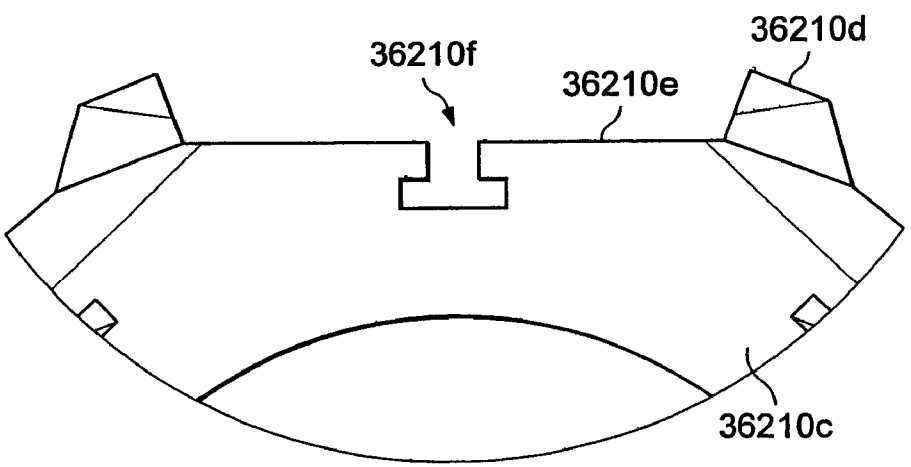
Figure 21A:
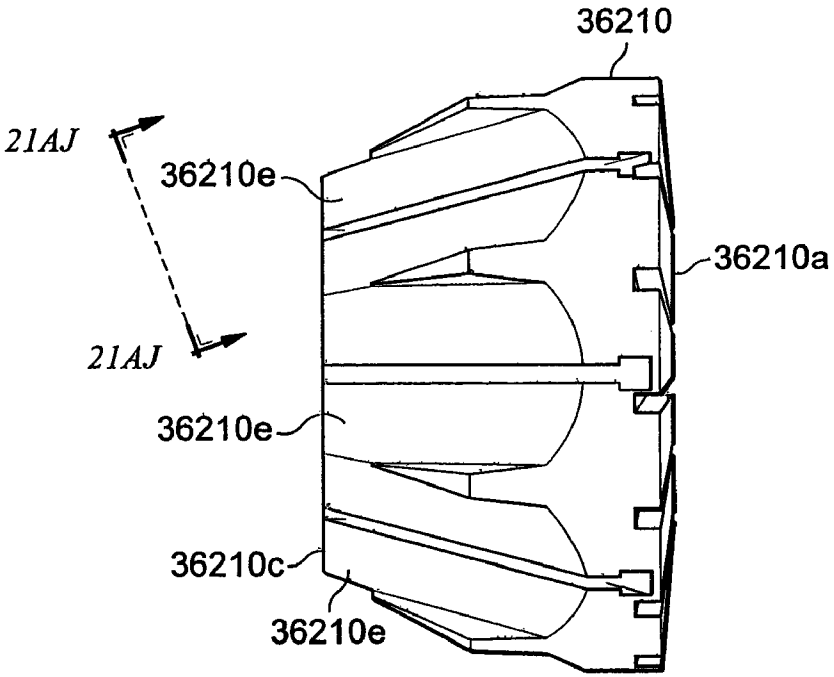
Figure 21A:
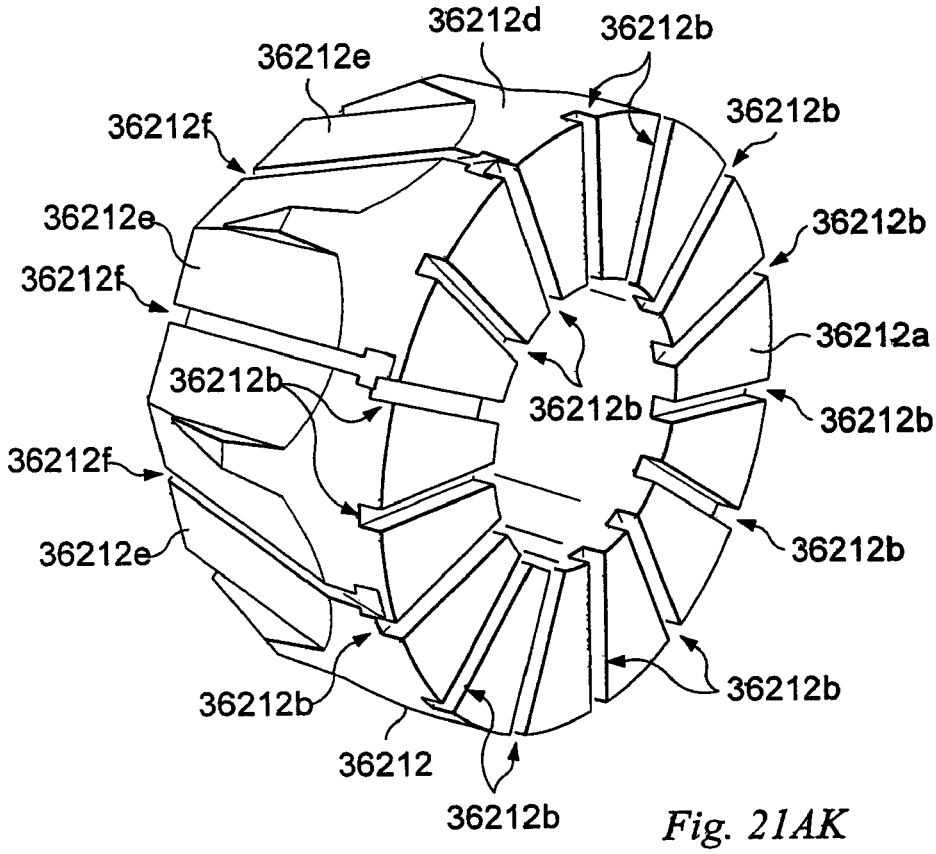
Figure 21A:
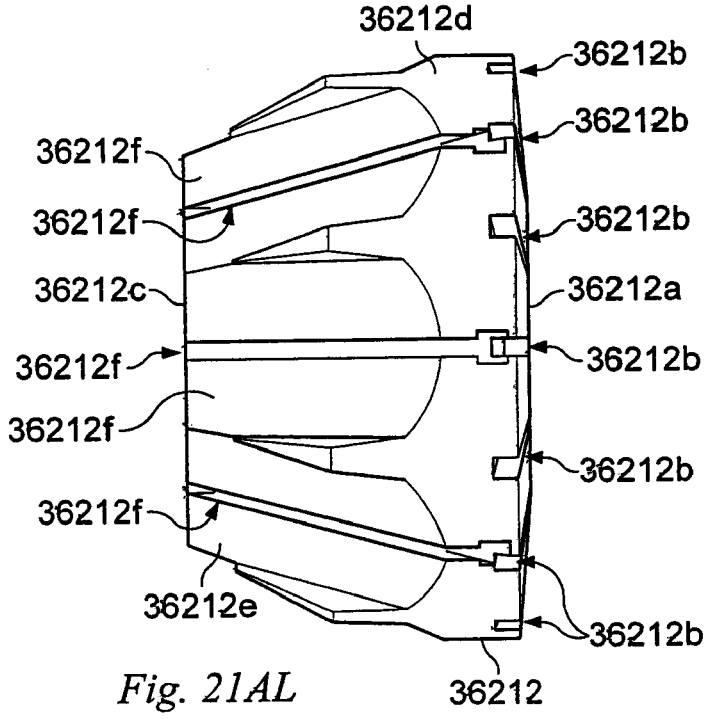
Figure 21A:
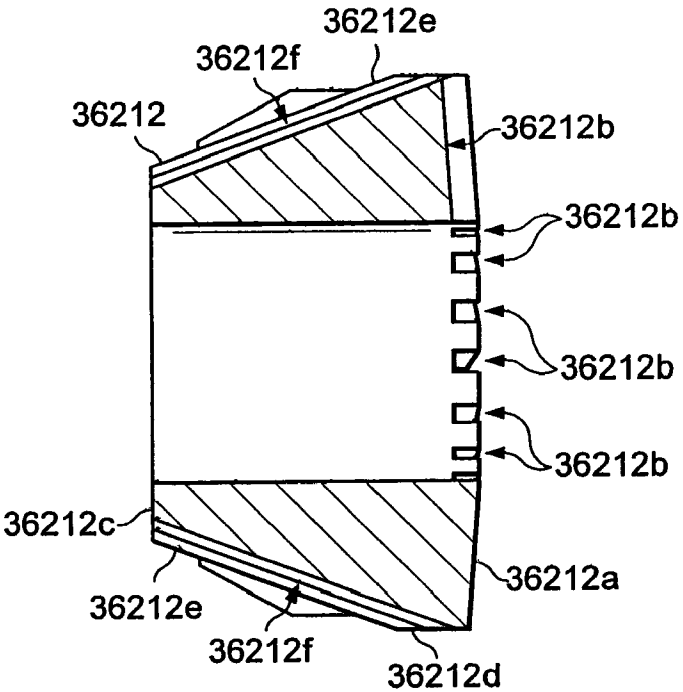
Figure 21A:
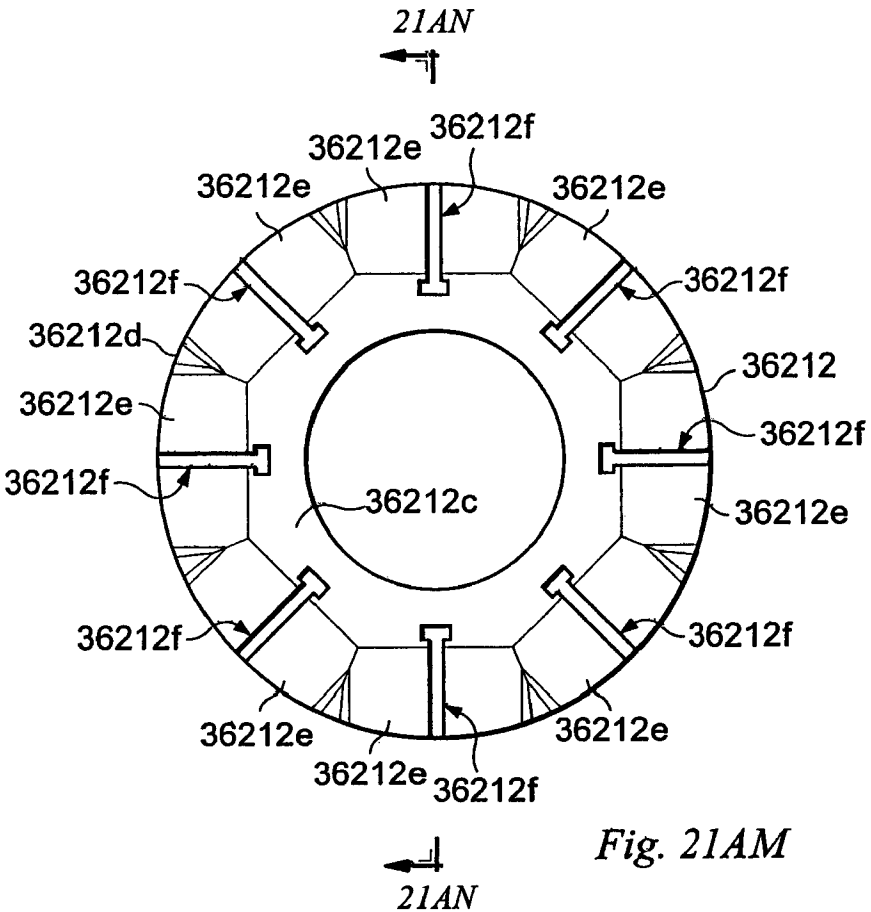
Figure 21A:
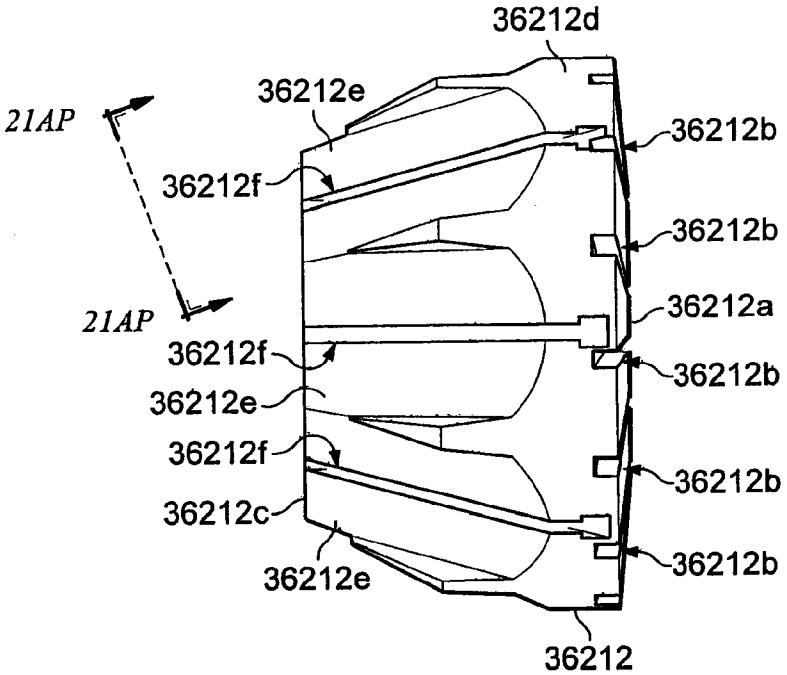
Figure 21A:
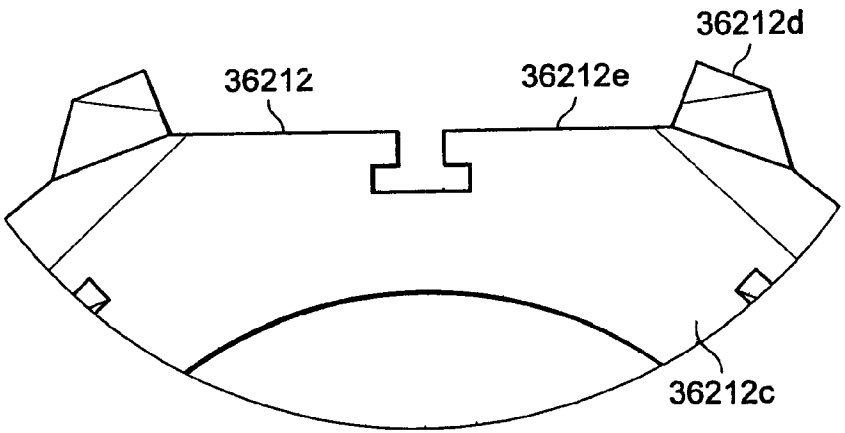
Figure 21A:
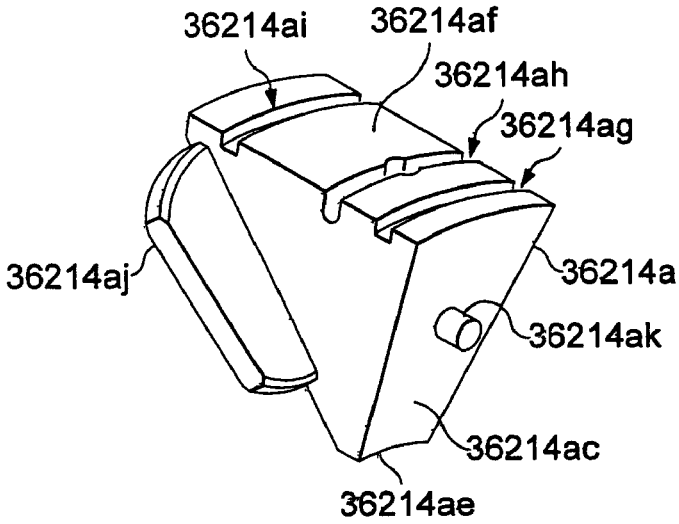
Figure 21A:
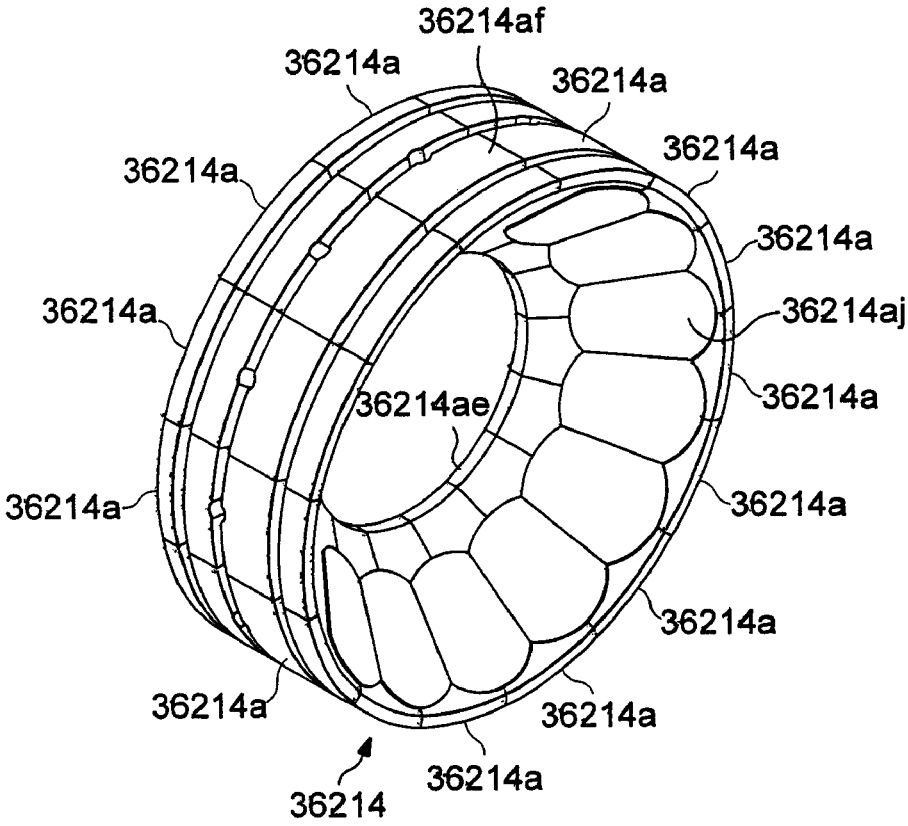
Figure 21A:
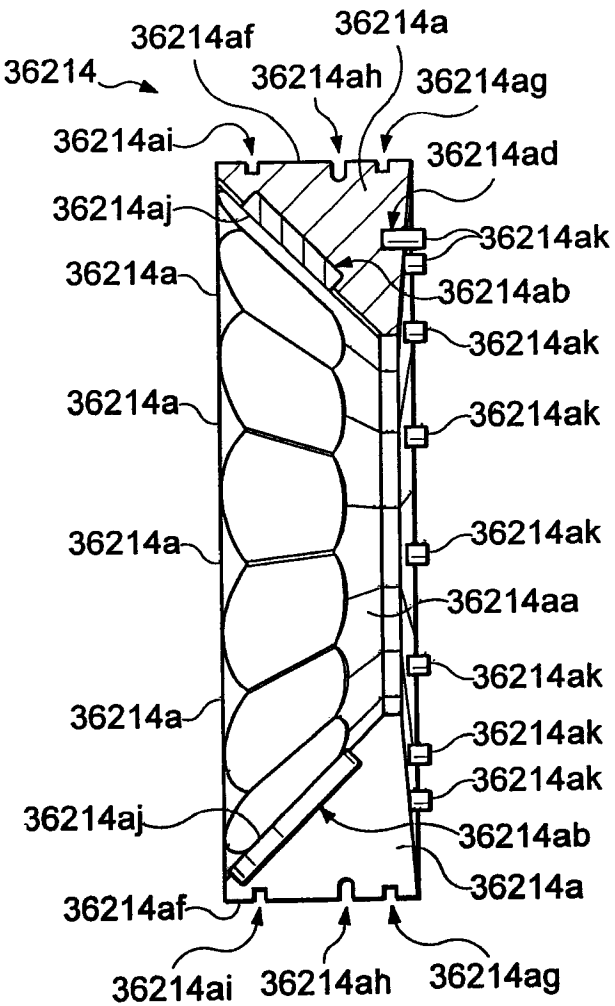
Figure 21A:
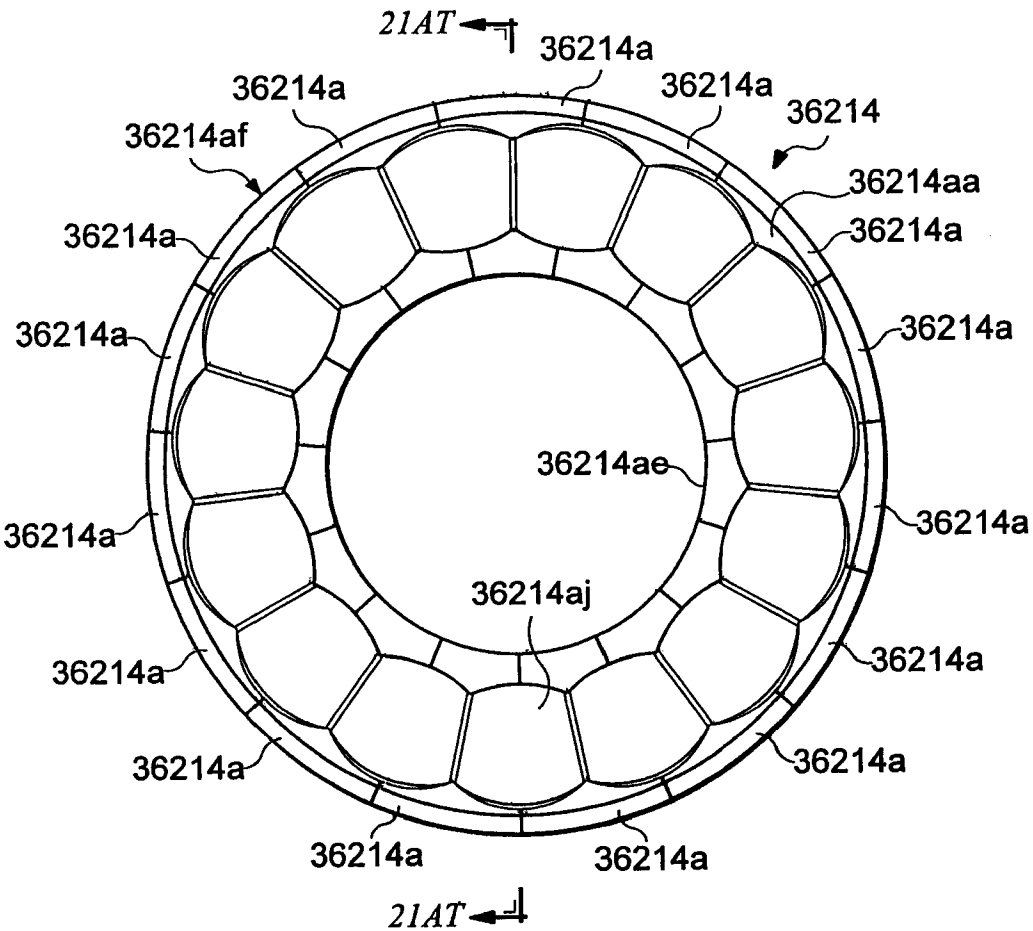
Figure 21A:
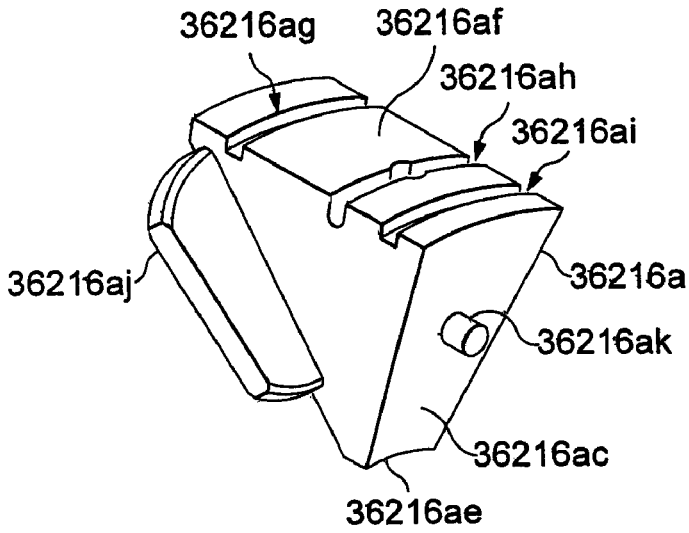
Figure 21A:
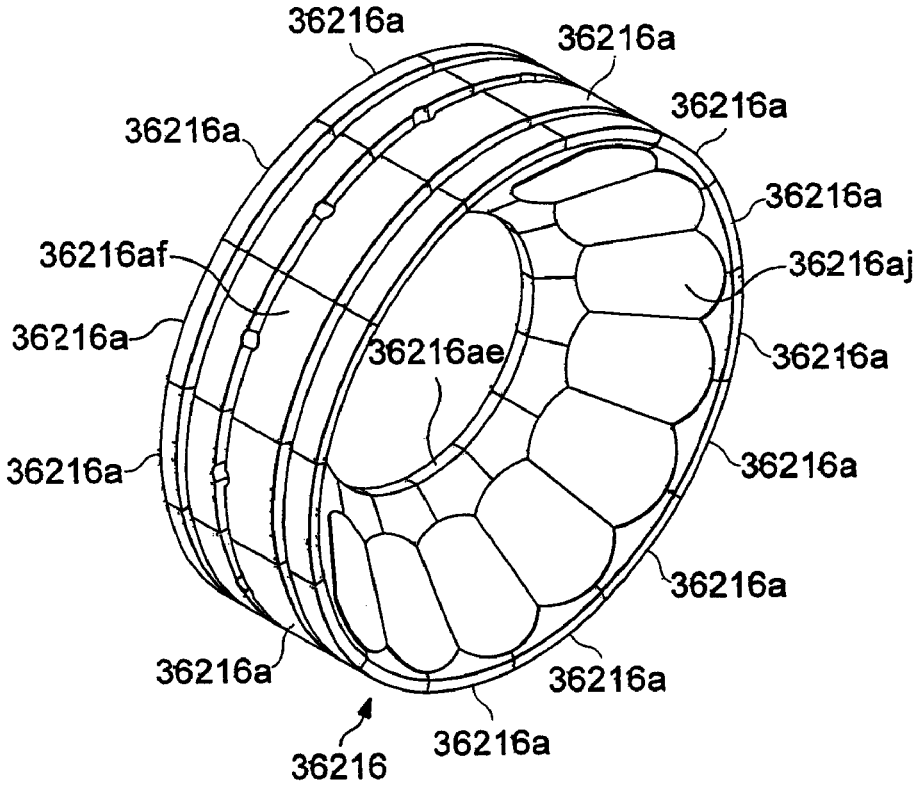
Figure 21A:
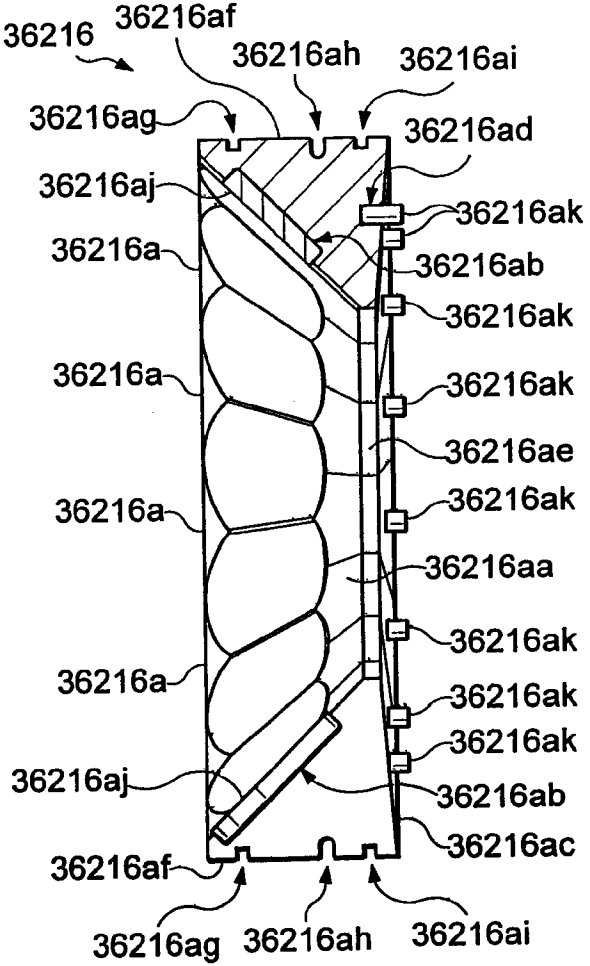
Figure 21A:
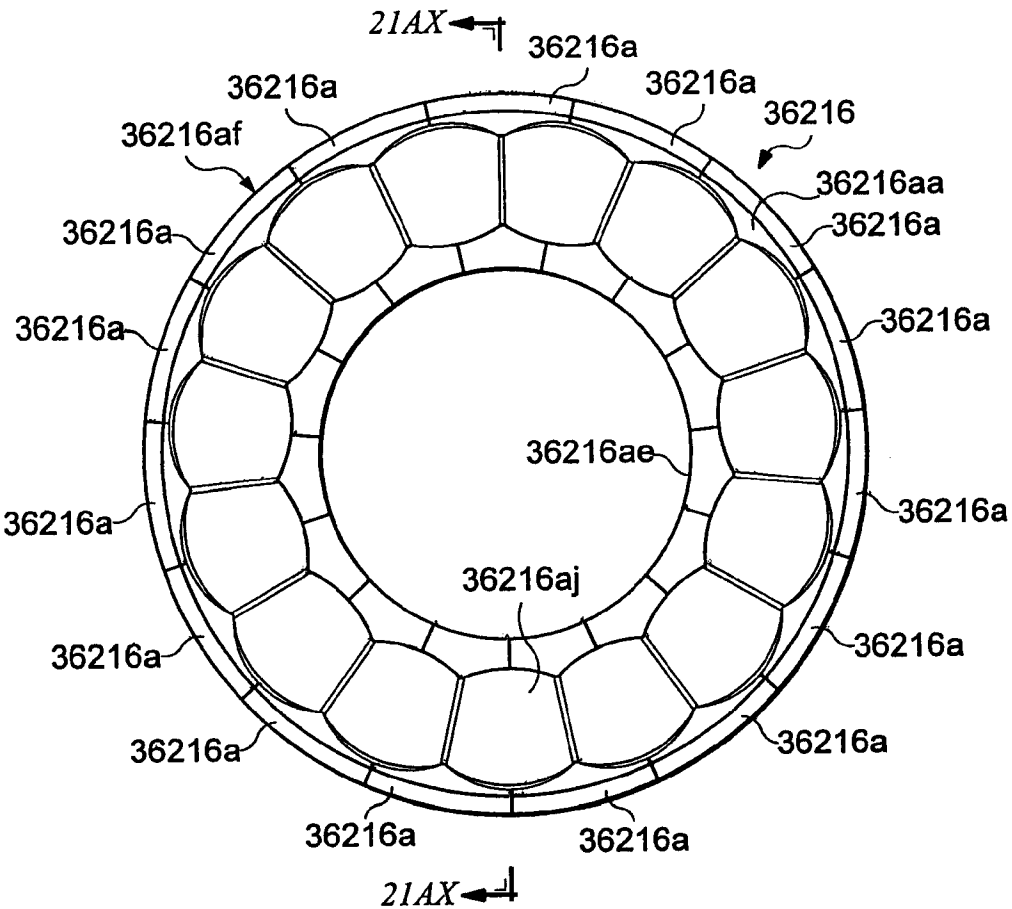

During operation of the alternative embodiment of the packer assembly 36 described above with reference to FIGS. 21 and 21A to 21 AX, the first step in setting the packer assembly 36 includes pushing the slip elements, 36206*a* and 36208*a*, of the upper and lower slip assemblies, 36206 and 36208, respectively, up the upper and lower tubular wedges, 36210 and 36212, respectively, which breaks the retaining rings, 36206*aw* and 36206*ax*, and 36208*aw* and 36208*ax*, respectively, and moves the slip elements outwardly against the interior surface of the expandable wellbore casing 100. In an exemplary embodiment, during the radial displacement of the slip elements, 36206*a* and 36208*a*, the retaining pins, 36206*au* and 36208*au*, respectively, and the mounting pins, 36206*at* and 36208*at*, respectively, maintain the slip elements in an evenly spaced apart configuration. In an exemplary embodiment, during the operation of the packer assembly 36, the mounting pins, 36214*ak* and 36216*ak*, maintain the extrusion limiter elements, 36214*a* and 36216*a*, of the upper and lower tubular extrusion limiter assemblies, 36214 and 36216, respectively, in an evenly spaced apart configuration. The operation of the alternative embodiment of the packer assembly 36 described above with reference to FIGS. 21 and 21A to 21AX is otherwise substantially identical to the operation of the packer assembly described above with reference to FIGS. 20A1 to 20A5, 20B1 to 20B5, 20C1 to 20C5, 20D1 to 20D5, 20E1 to 20E6, 20F1 to 20F6, 20G1 to 20G6, and 20H1 to 20H5.

In an exemplary embodiment, as illustrated in FIGS. 22A to 22D, a packer setting tool assembly 38 includes a tubular adapter 3802 that defines a longitudinal passage 3802*a*, radial external mounting holes, 3802*b* and 3802*c*, radial passages, 3802*d* and 3802*e*, and includes an external threaded connection 3802*f* at one end and an internal annular recess 3802*g* having an internal threaded connection at the other end.

An external threaded connection 3804*a* of an end of a tubular support or tubular upper mandrel 3804 that defines a longitudinal passage 3804*b*, external mounting holes, 3804*c* and 3804*d*, and includes an external annular recess 3804*e*, an external annular recess 3804*f*, external splines 3804*g*, an external flange 3804*h*, external splines 3804*i*, and an internal threaded connection 3804*j* at another end is received within and is coupled to the internally threaded connection of the internal annular recess 3802*g* of the other end of the tubular adaptor 3802. The tubular upper mandrel 3804 further includes external mounting holes, 3804*k* and 38041, radial passages, 3804*m* and 3804*n*, and external mounting holes, 3804*o* and 3804*p*.

Torque pins, 3805*a* and 3805*b*, are received within and coupled to the mounting holes, 3804*c* and 3804*d*, respectively, of the tubular upper mandrel 3804 and also extend into the radial passages, 3802*d* and 3802*e*, respectively, of the tubular adaptor 3802.

An external threaded connection 3806*a* of an end of a tubular support or tubular mandrel 3806 that defines a longitudinal passage 3806*b* and includes an external annular recess 3806*c* and an external annular recess 3806*d* having an external threaded connection is received within and is coupled to the internal threaded connection 3804*j* of the tubular upper mandrel 3804.

An internal threaded connection 3808*a* of a tubular stinger 3808 that defines a longitudinal passage 3808*b* and includes an external annular recess 3808*c*, and an external tapered annular recess 3808*d* and an engagement shoulder 3808*e* at another end receives and is coupled to the external threaded connection of the external annular recess 3806*d* of the mandrel 3806. A sealing member 3810 is mounted upon and coupled to the external annular recess 3806*d* of the mandrel 3806.

Internal splines 3812*aa* of a key 3812*a* that includes an internal annular recess 3812*ab* at one end are movably received within and engage the external splines 3804*g* of the tubular upper mandrel 3804. Similarly, internal splines 3812*ba* of a key 3812*b* that includes an internal annular recess 3812*bb* at one end are movably received within and engage the external splines 3804*g* of the tubular upper mandrel 3804.

An end of a tubular support or tubular bushing 3816 that defines a longitudinal passage 3816*a* for receiving and mating with the upper mandrel 3804, and radial passages, 3816*b* and 3816*c*, and includes an external flange 3816*d*, an internal annular recess 3816*e*, circumferentially spaced apart teeth 3816*f*, and external flanges, 3816*g* and 3816*h*, at another end mates with the other ends of the keys, 3812*a* and 3812*b*. The external flange 3804*h* of the upper mandrel 3804 extends within the internal annular recess 3816*e* of the tubular bushing 3816 so that the tubular bushing 3816 is retained between the keys, 3812*a* and 3812*b*, and the external flange 3804*h* of the upper mandrel 3804. The tubular bushing 3816 further includes radial holes, 3816*i* and 3816*j*, through which the keys, 3812*a* and 3812*b*, respectively, radially extend so that the keys, 3812*a* and 3812*b*, lock the bushing 3816 to the upper mandrel 3804. The tubular bushing 3816 further includes an external annular recess 3816*k*.

A tubular support or tubular spacer 3818 defines a longitudinal passage 3818*a* for receiving the upper mandrel 3804, includes an annular portion 3818*b* at one end that is near or adjacent the other end of the tubular adaptor 3802, further defines radial passages, 3818*c* and 3818*d*, and further includes an external annular recess 3818*e*, an external annular recess 3818*f*, an internal annular recess 3818*g*, and counterbores, 3818*h* and 3818*i*, that are axially aligned with the holes, 3804*k* and 38041, respectively, of the upper mandrel 3804. The external annular recesses, 3818*e* and 3818*f*, define an annular protrusion 3818*j*. Screws 3820*a* and 3820*b* are threadably engaged with the counterbores, 3818*h* and 3818*i*, respectively, of the tubular spacer 3818, and extend into the holes 3804*m* and 38041, respectively, of the upper mandrel 3804, thereby coupling the tubular spacer 3818 to the upper mandrel 3804.

An end of a tubular packer cup sleeve 3822 that defines a longitudinal passage 3822*a* for receiving the upper mandrel 3804 and includes an external annular recess 3822*b* and an internal annular recess 3822*c*, extends into the internal annular recess 3818*g* of the tubular spacer 3818. A retaining ring 3824 is disposed in the external annular recess 3804*e* of the upper mandrel 3804 and extends into the internal annular recess 3822*c* of the packer cup sleeve 3822, retaining the end of the packer cup sleeve 3822 in the internal annular recess 3818*g* of the tubular spacer 3818, thereby coupling the packer cup sleeve 3822 to the upper mandrel 3804.

A packer cup 3824 is disposed in the external annular recess 3822*b* of the packer cup sleeve 3822, and a packer ring 3825 is disposed in the external annular recess 3822*b* of the packer cup sleeve 3822 and is axially positioned between the packer cup 3824 and the tubular spacer 3818.

An end of a tubular support or tubular upper sleeve 3826 that defines a longitudinal passage 3826*a* and includes an internal annular recess 3826*b*, an internal annular recess 3826*c*, an internal annular recess 3826*d*, an internal annular recess 3826*e*, an internal annular recess 3826*f*, and an internal threaded connection 3826*g*, is positioned near or adjacent the annular portion 3818*b* of the tubular spacer 3818 so that the annular portion 3818*b* of the tubular spacer 3818 is axially positioned between the tubular adaptor 3802 and the upper sleeve 3826. Radial holes, 3826*h* and 3826*i*, extend through the internal annular recess 3826*b*, and radial holes, 3826*j* and 3286*k*, extend through the internal annular recess 3826*d*. The packer cup 3824 sealingly engages the internal annular recess 3826*c* of the upper sleeve 3826.

Figure 22A:
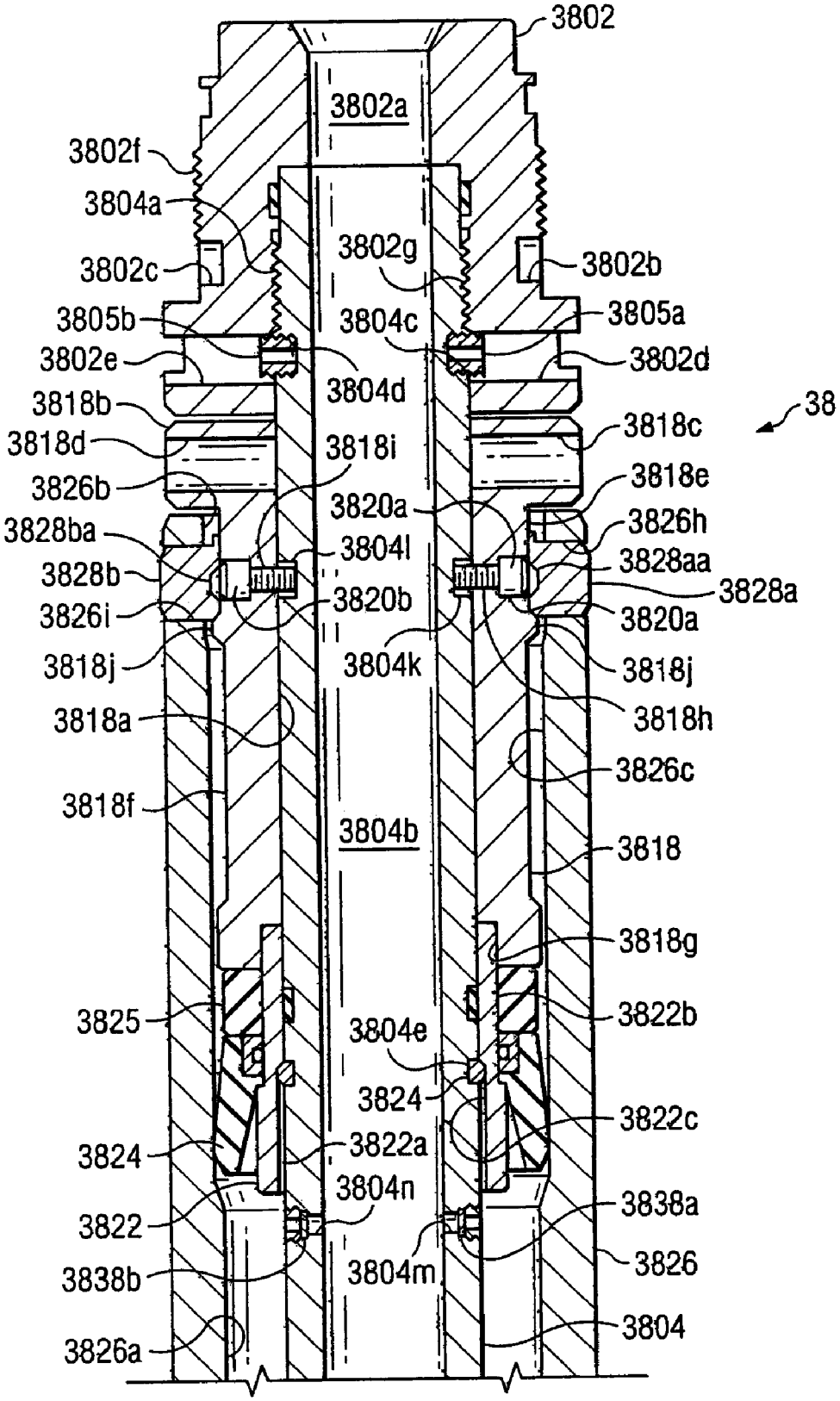
FIGS. 22A to 22D is a fragmentary cross-sectional illustration of another exemplary embodiment of a packer setting tool assembly.
Figure 22B:
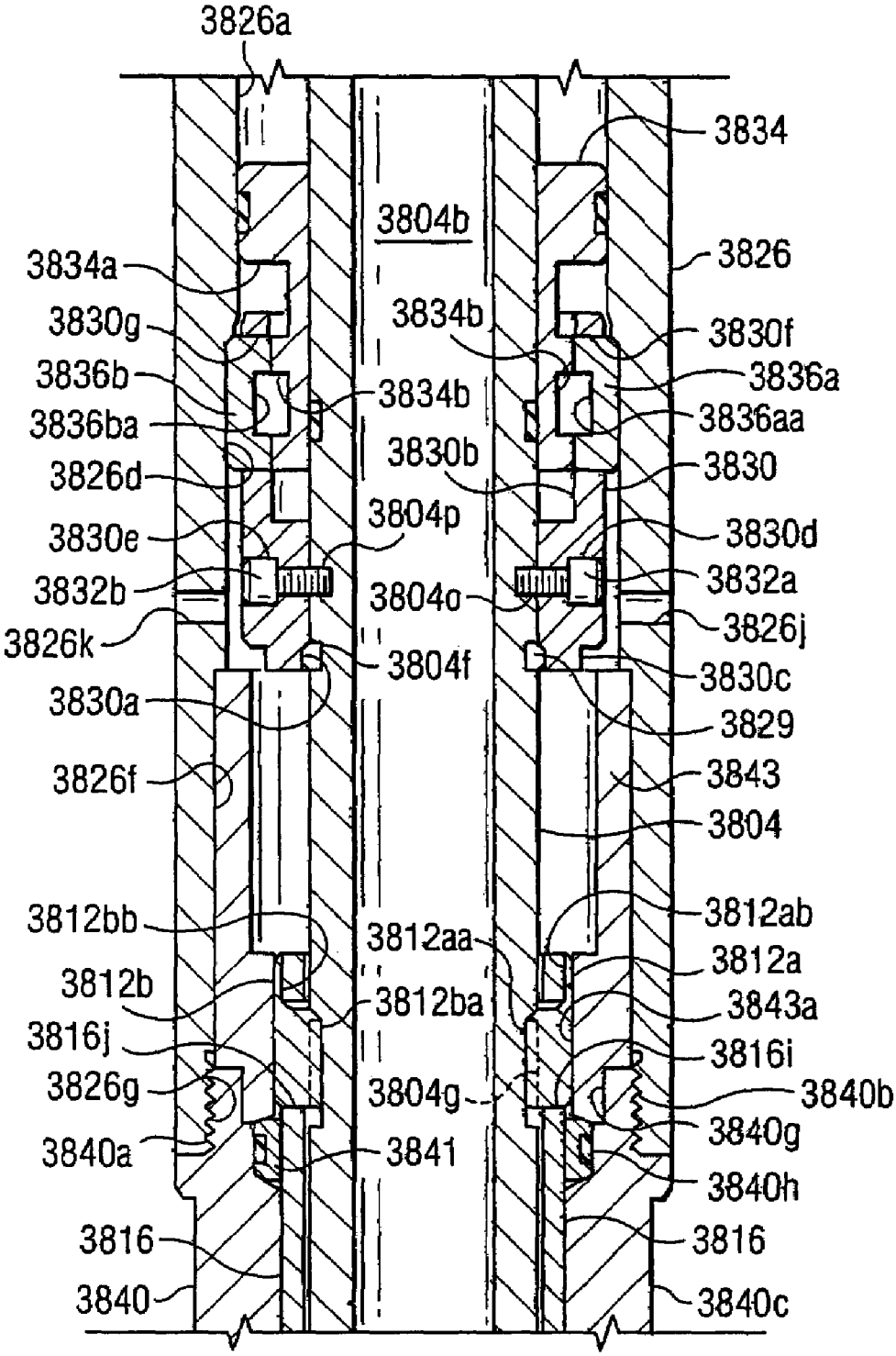
Figure 22C:
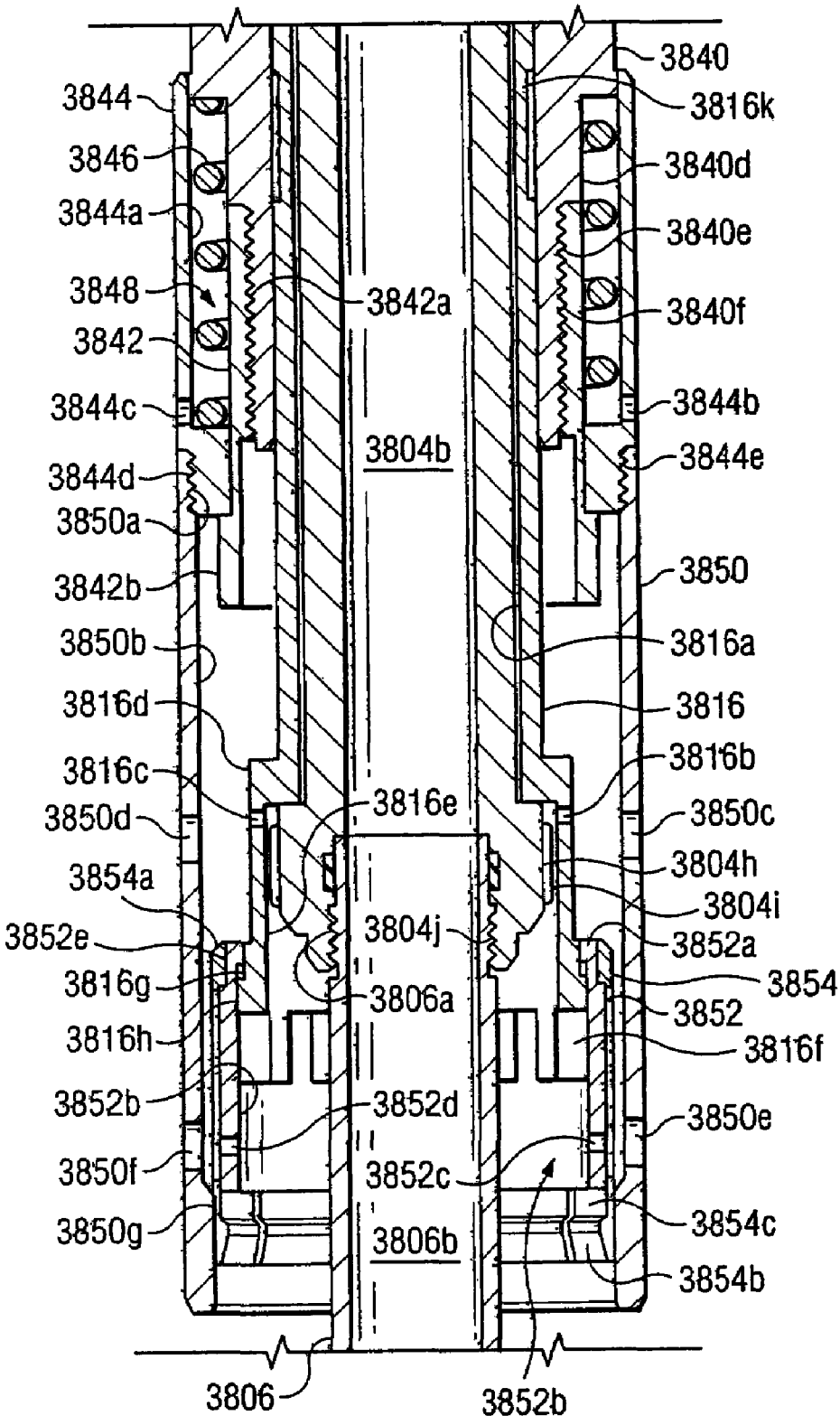
Figure 22D:
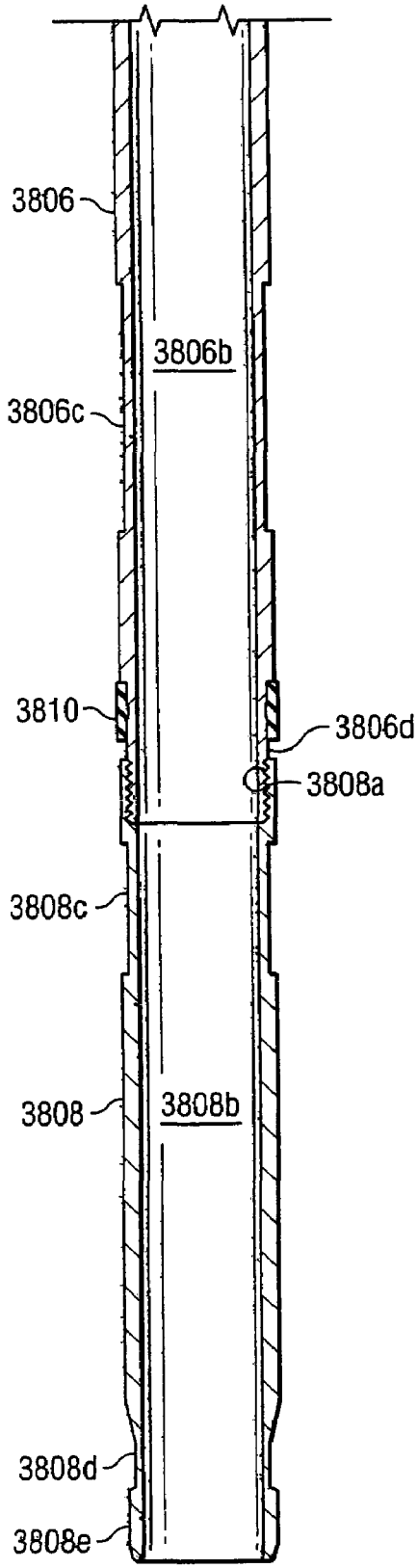
Figure 23A:
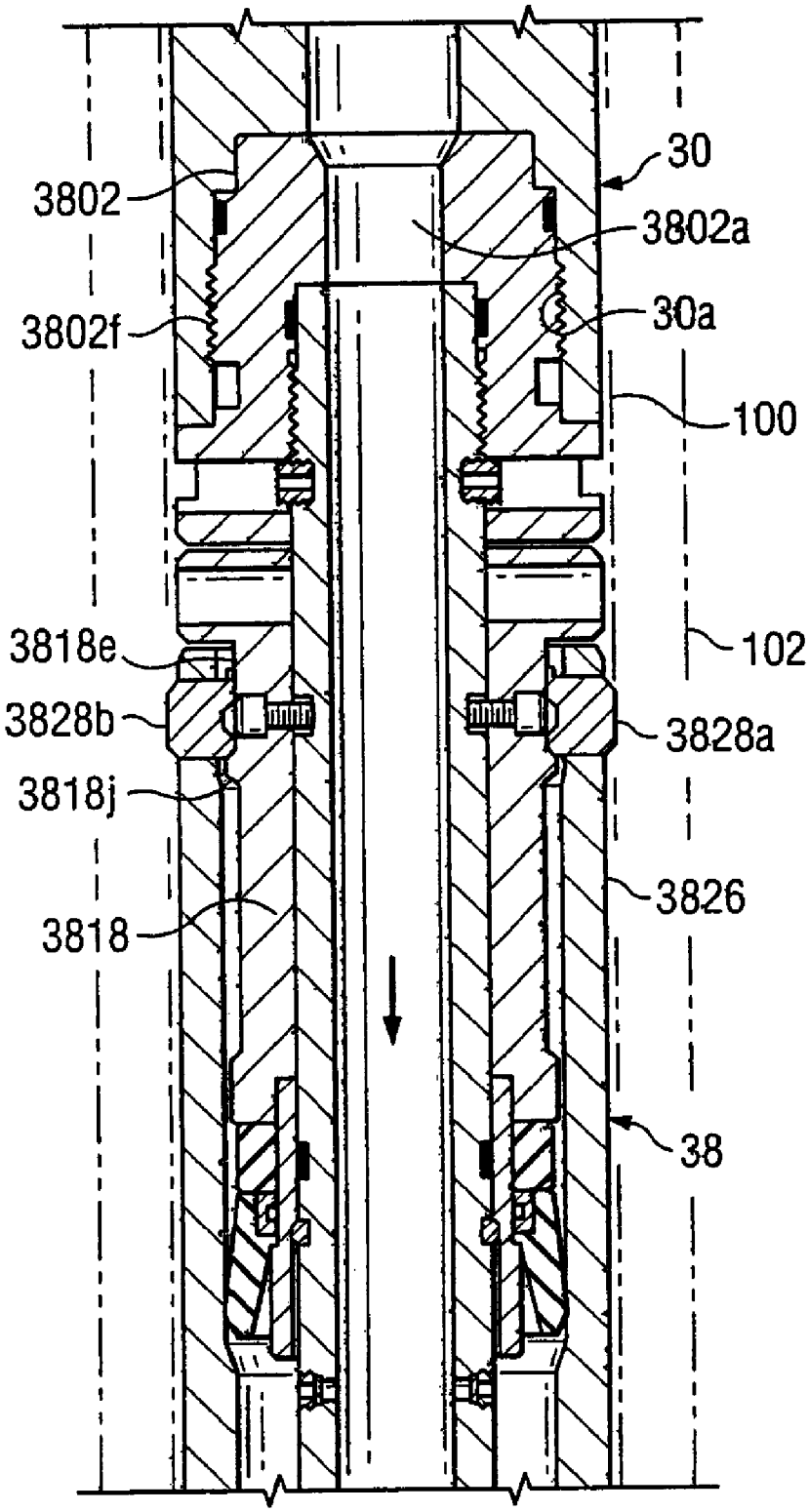
FIGS. 23A to 23E, 24A to 24E, 25A to 25E, 26A to 26E, 27A to 27E, 28A to 28E, 29A to 29E, 30A to 30E, 31A to 31E, 32A to 32E and 33A to 33E, are fragmentary cross-sectional illustrations of an exemplary embodiment of the operation of the packer setting tool assembly of FIGS. 22A to 22D and the packer assembly of FIGS. 19-1 to 19-5.
Figure 23B:
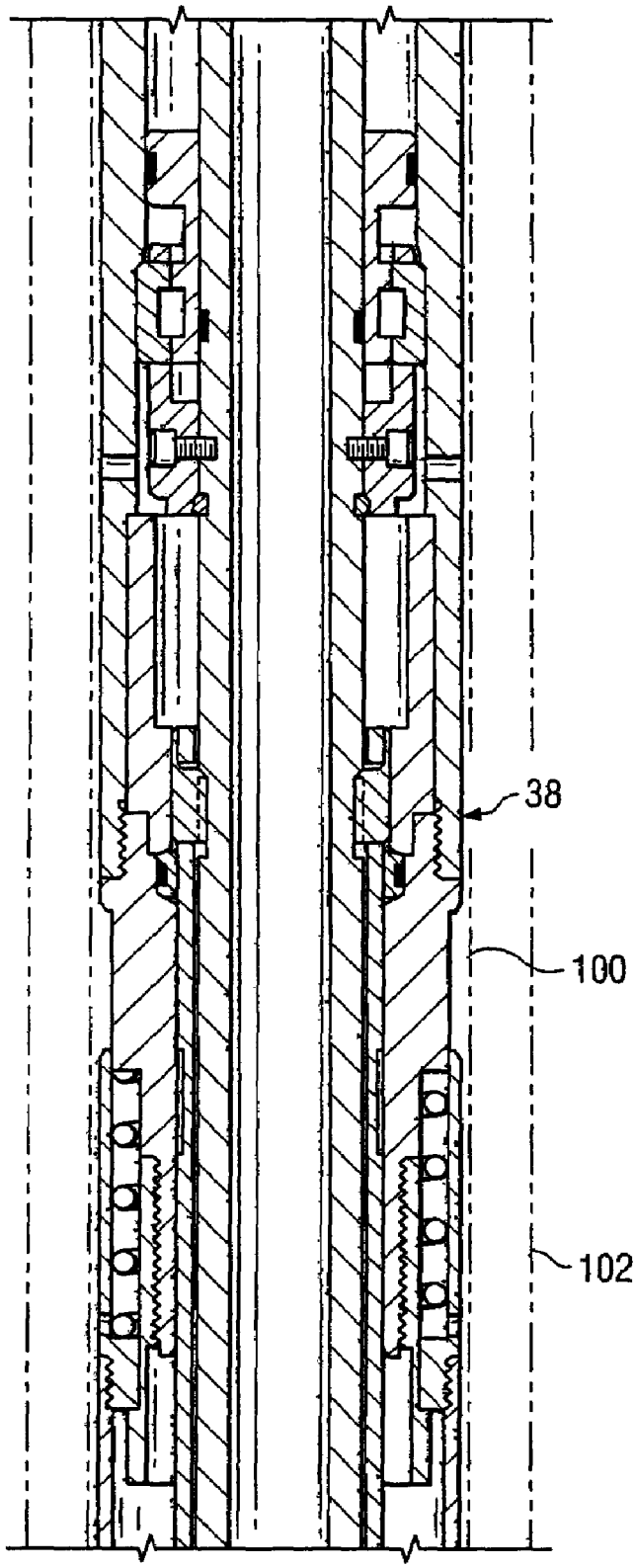
Figure 23C:
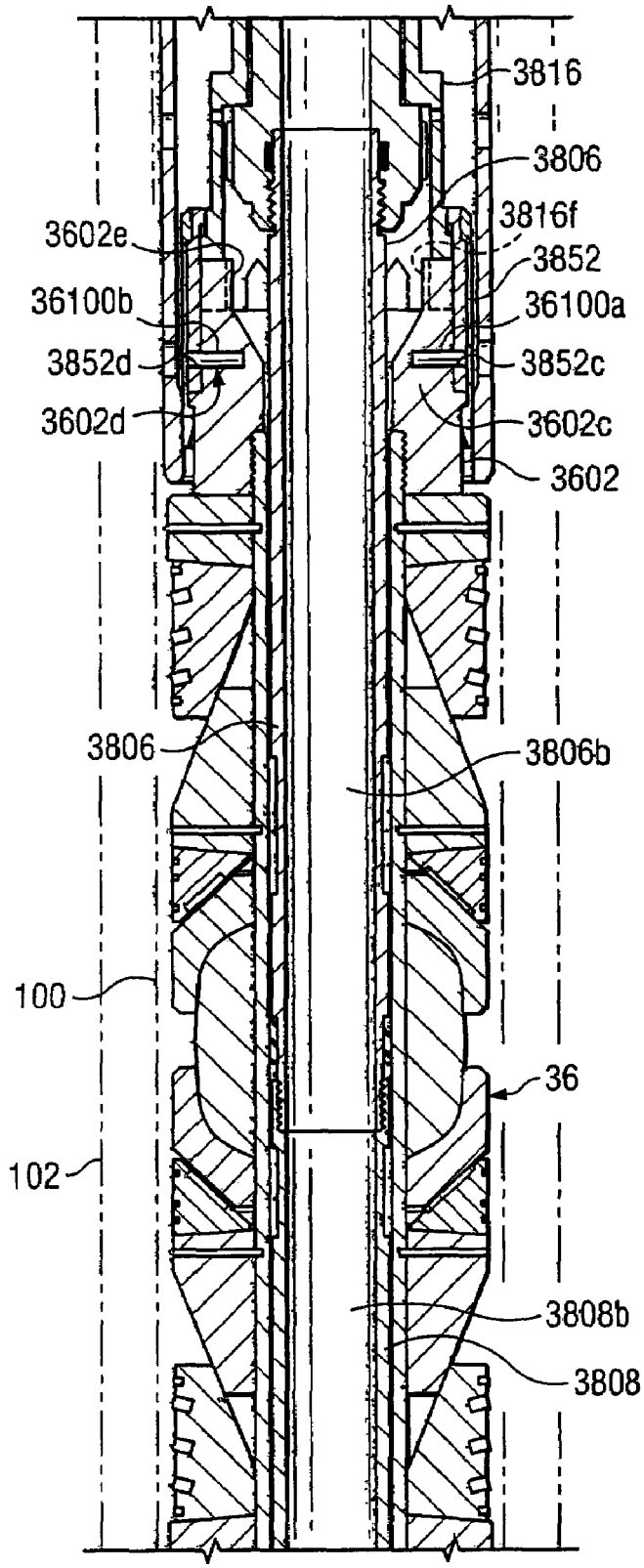
Figure 23D:
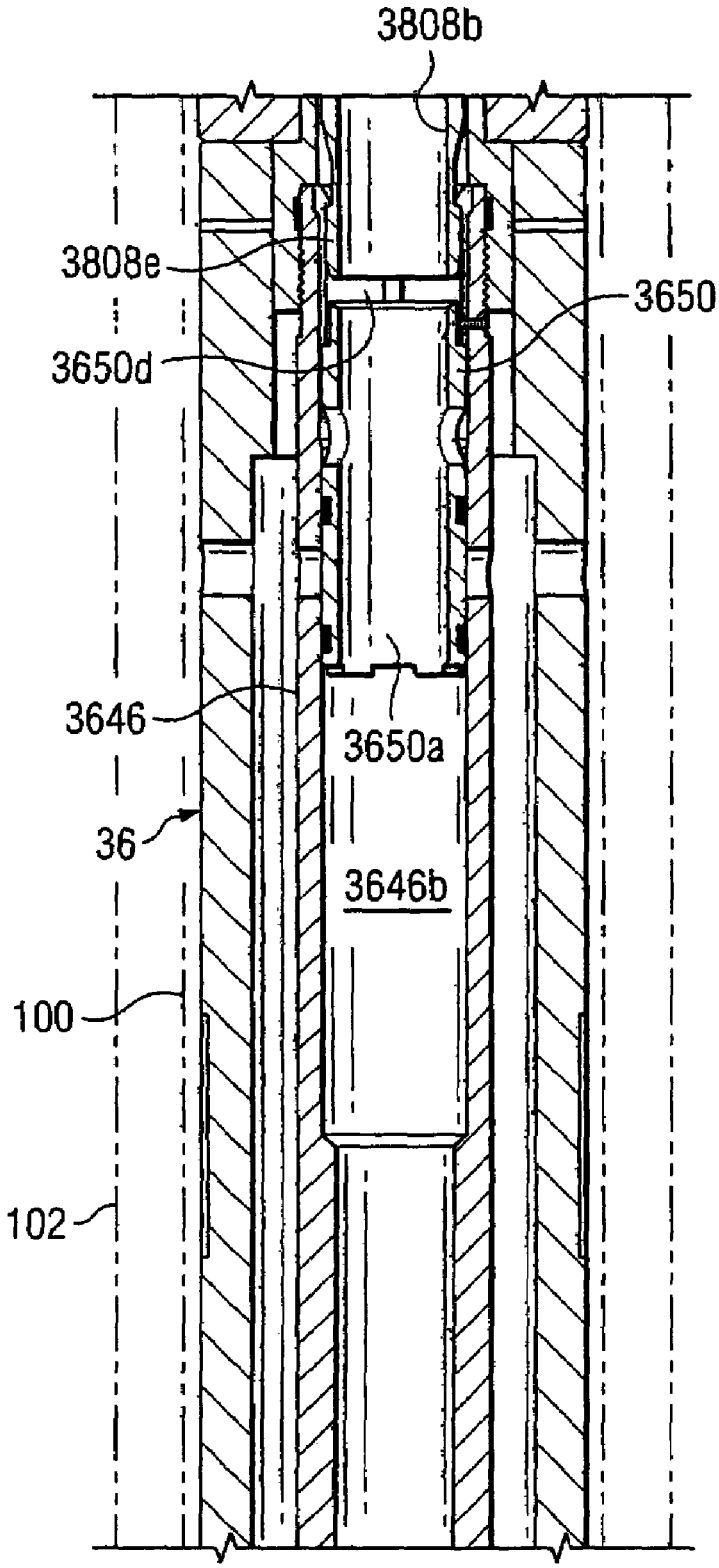
Figure 23E:
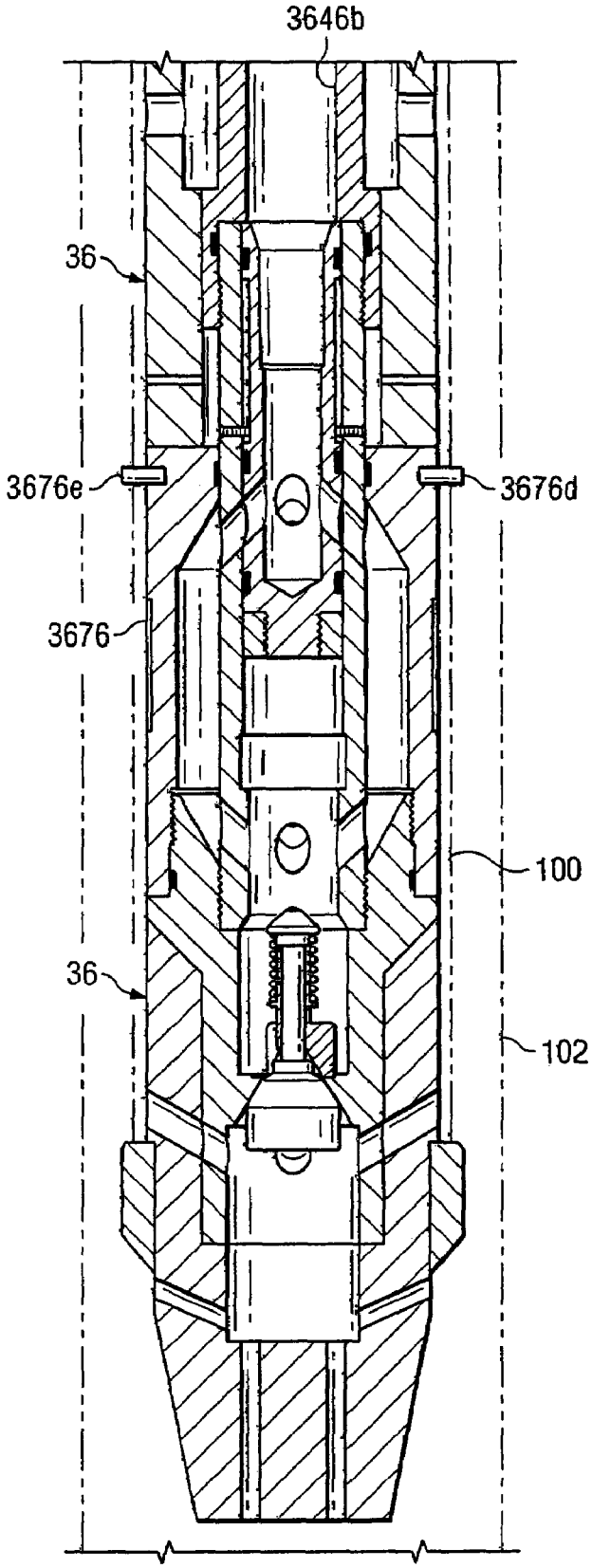
Figure 24A:
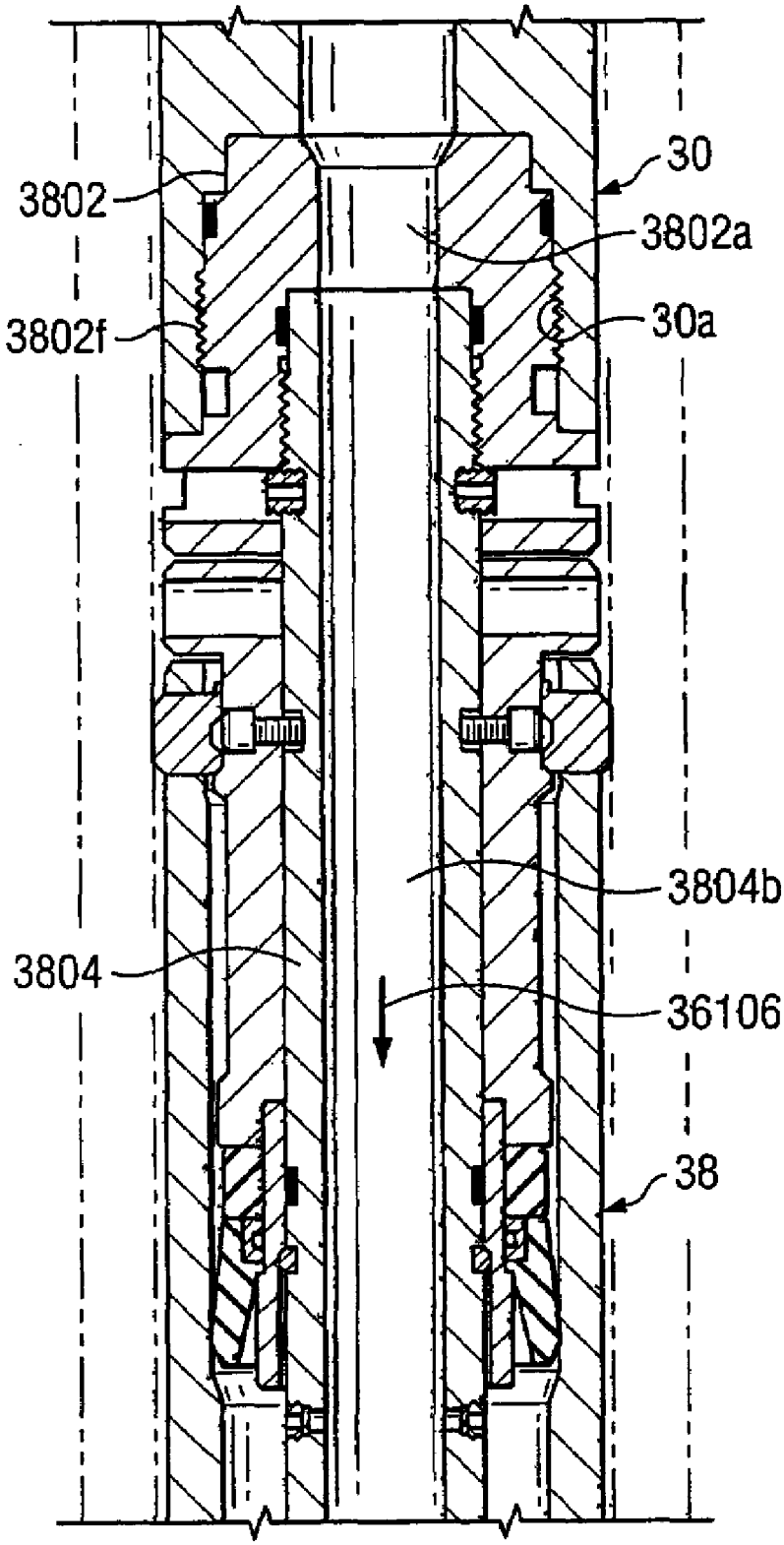
Figure 24B:
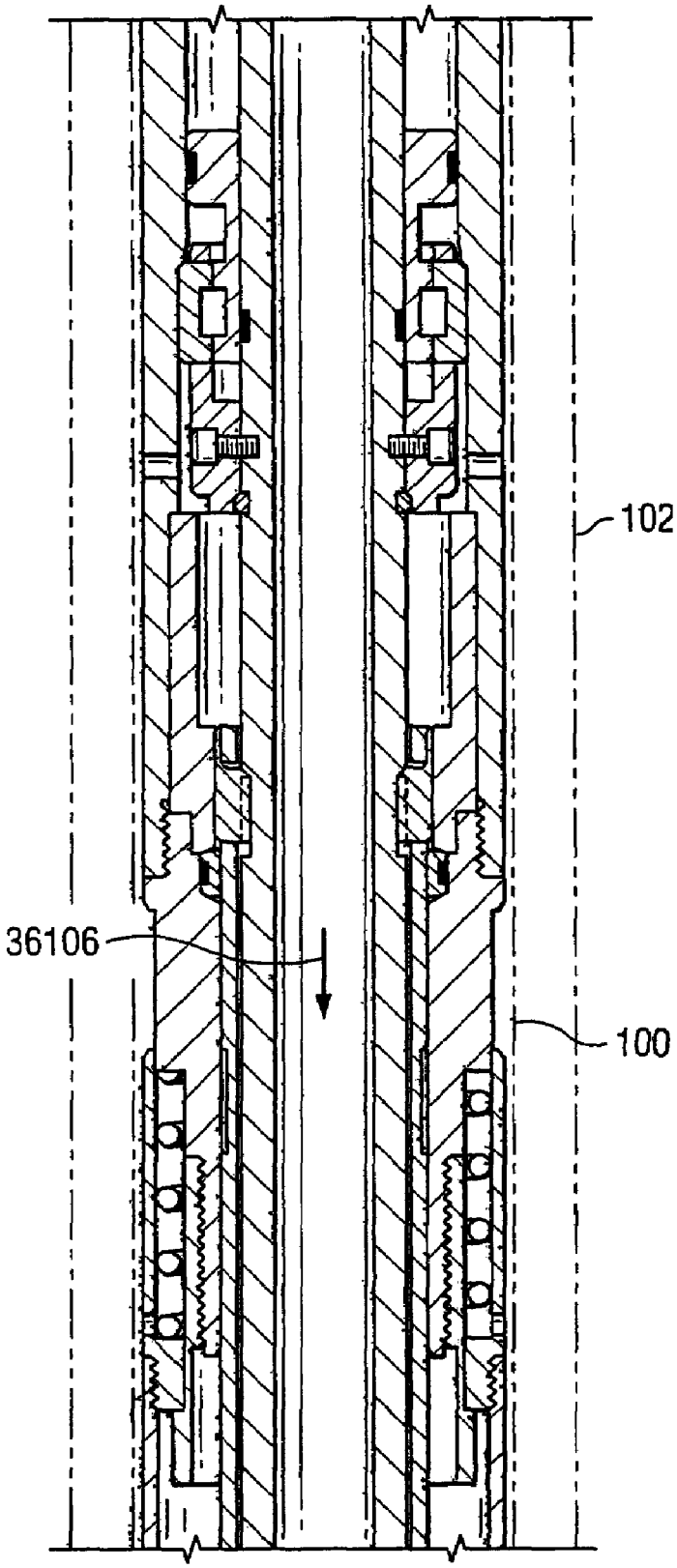
Figure 24C:
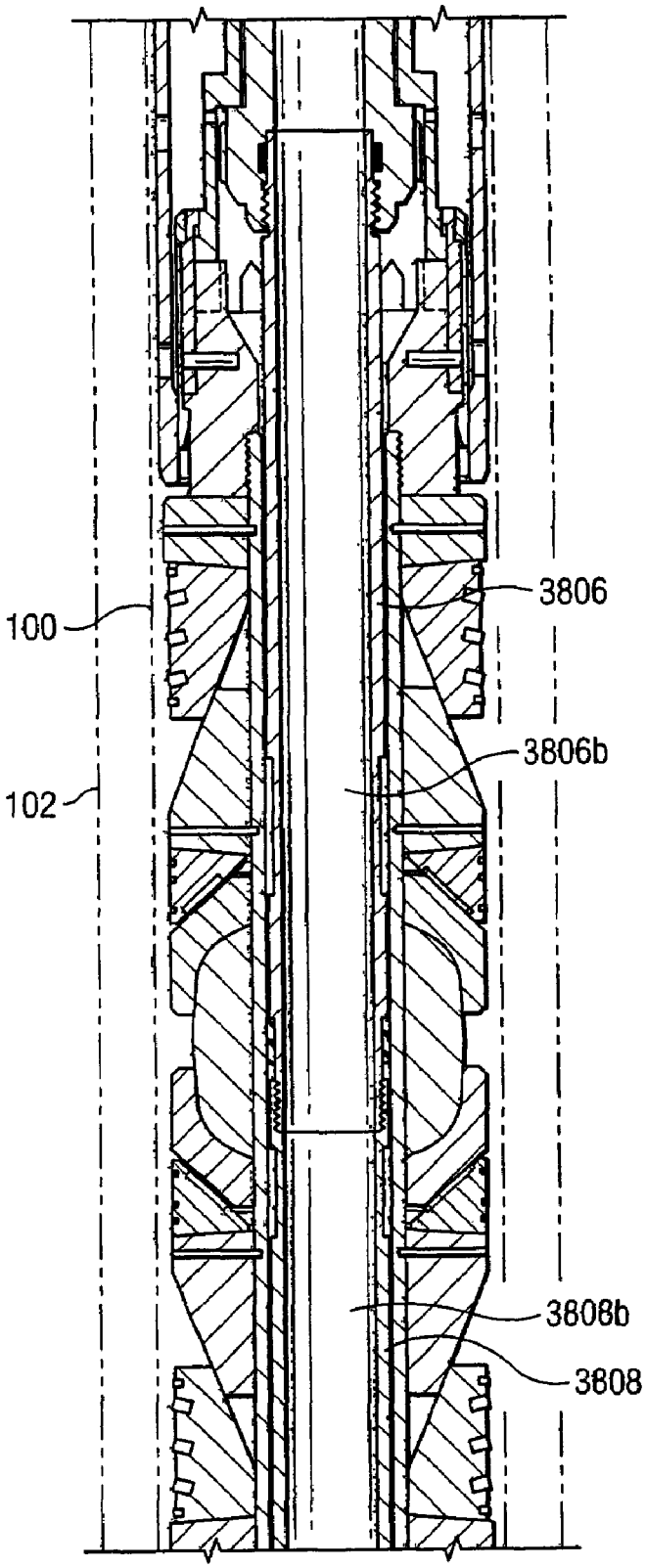
Figure 24D:
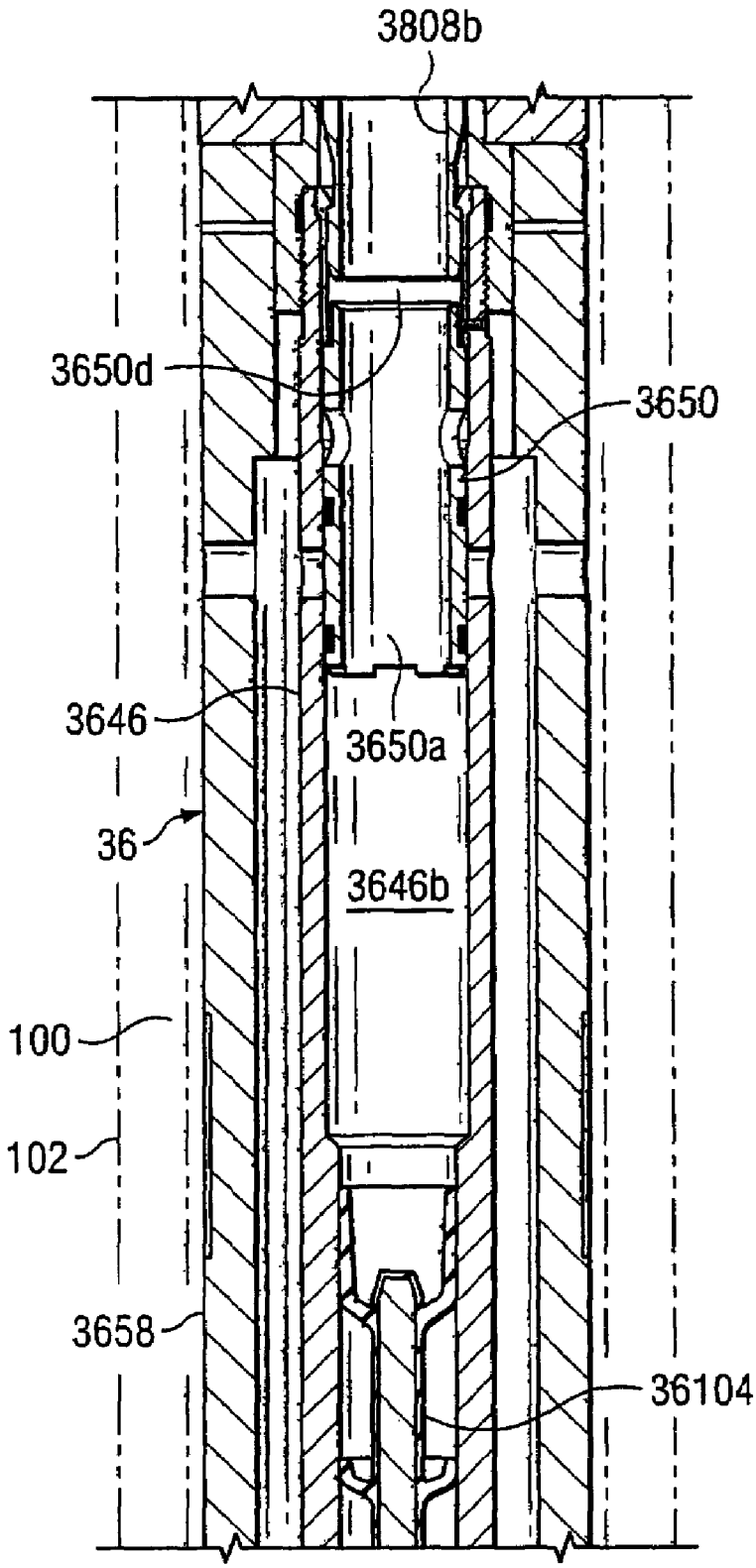
Figure 24E:
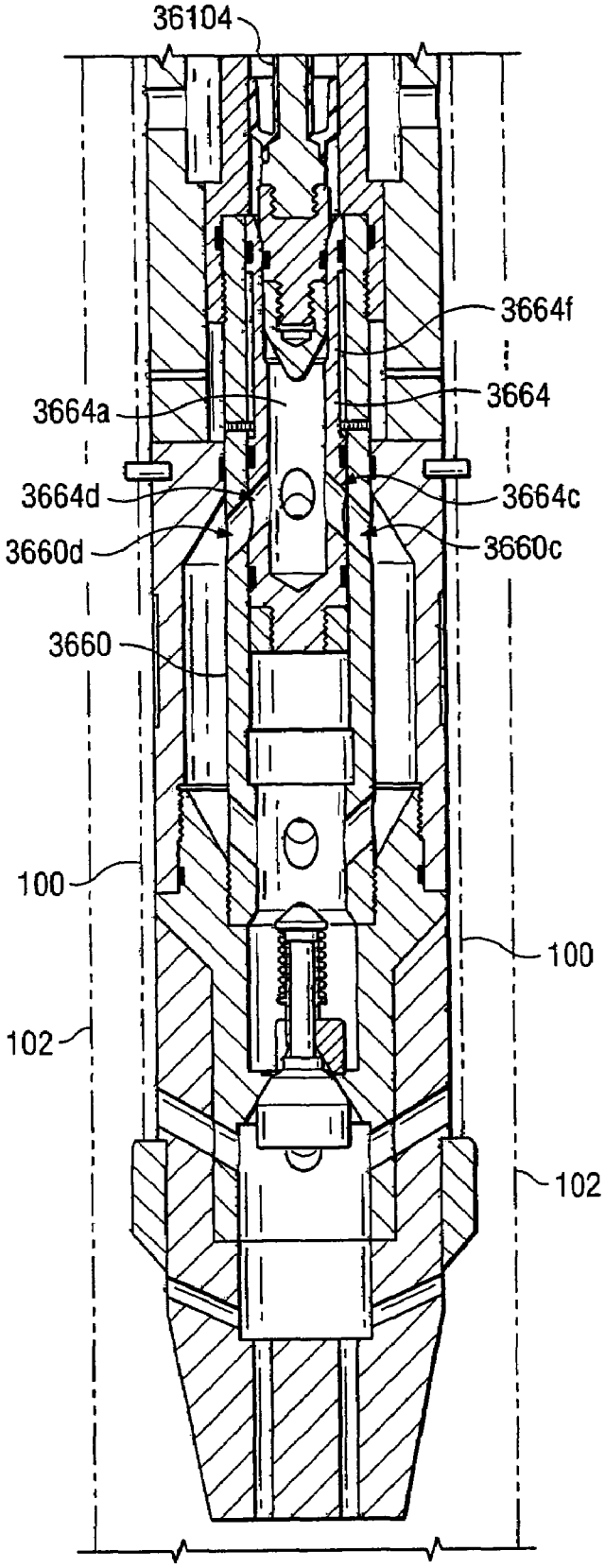
Figure 25A:
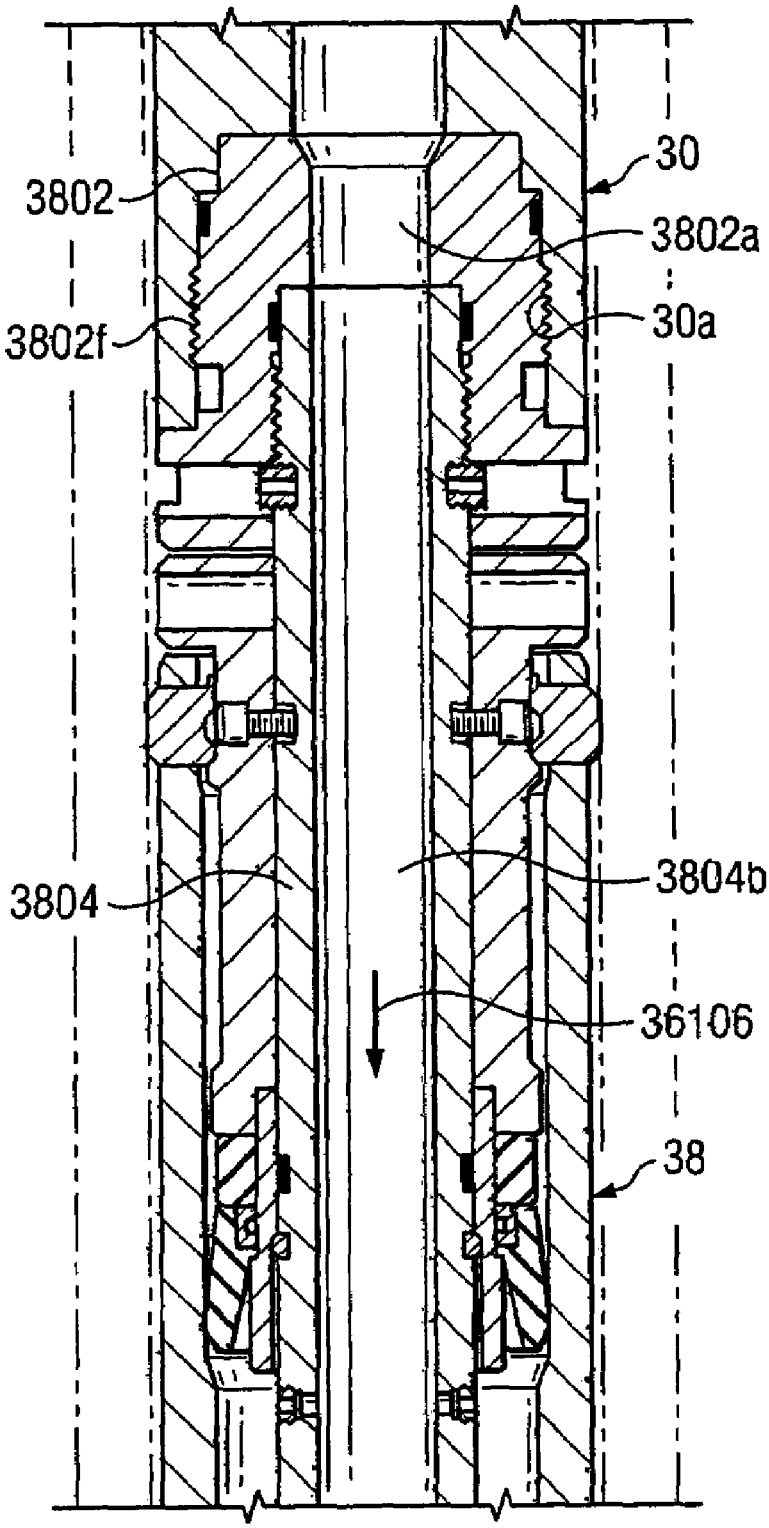
Figure 25B:
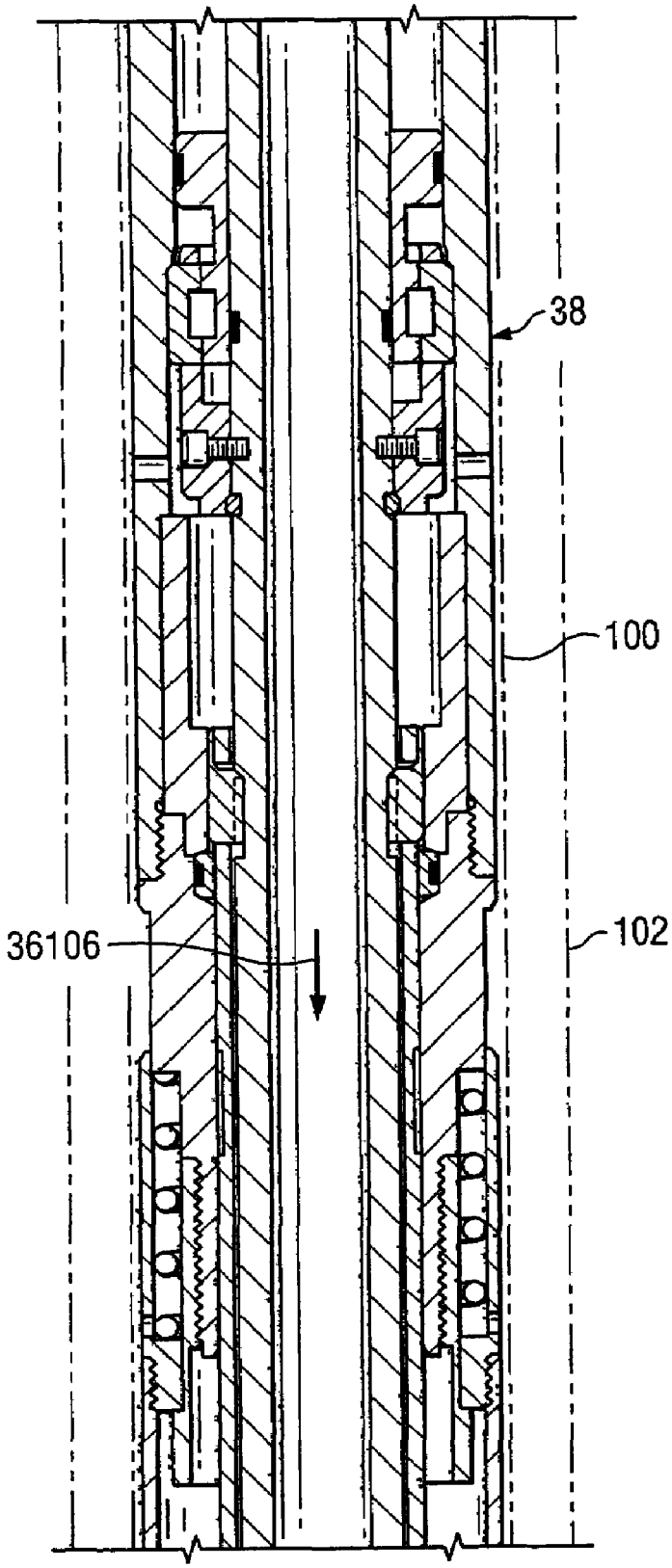
Figure 25C:
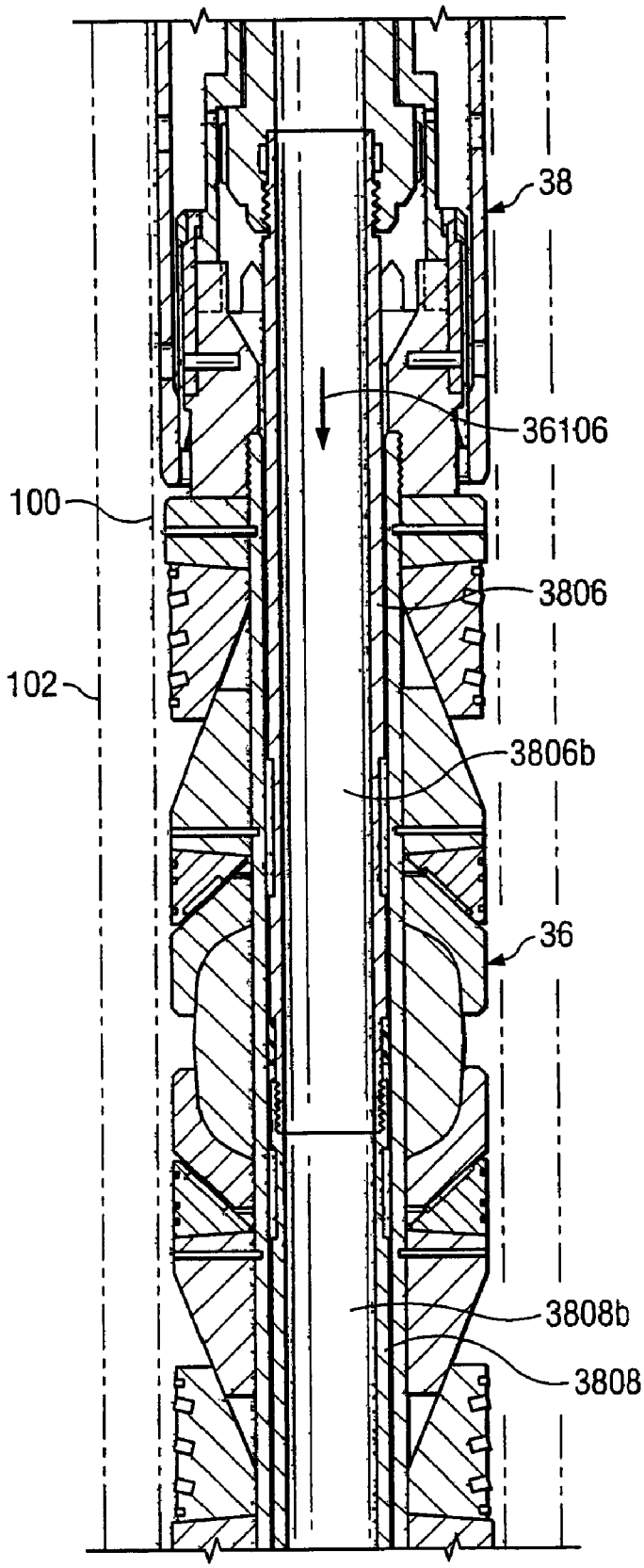
Figure 25D:
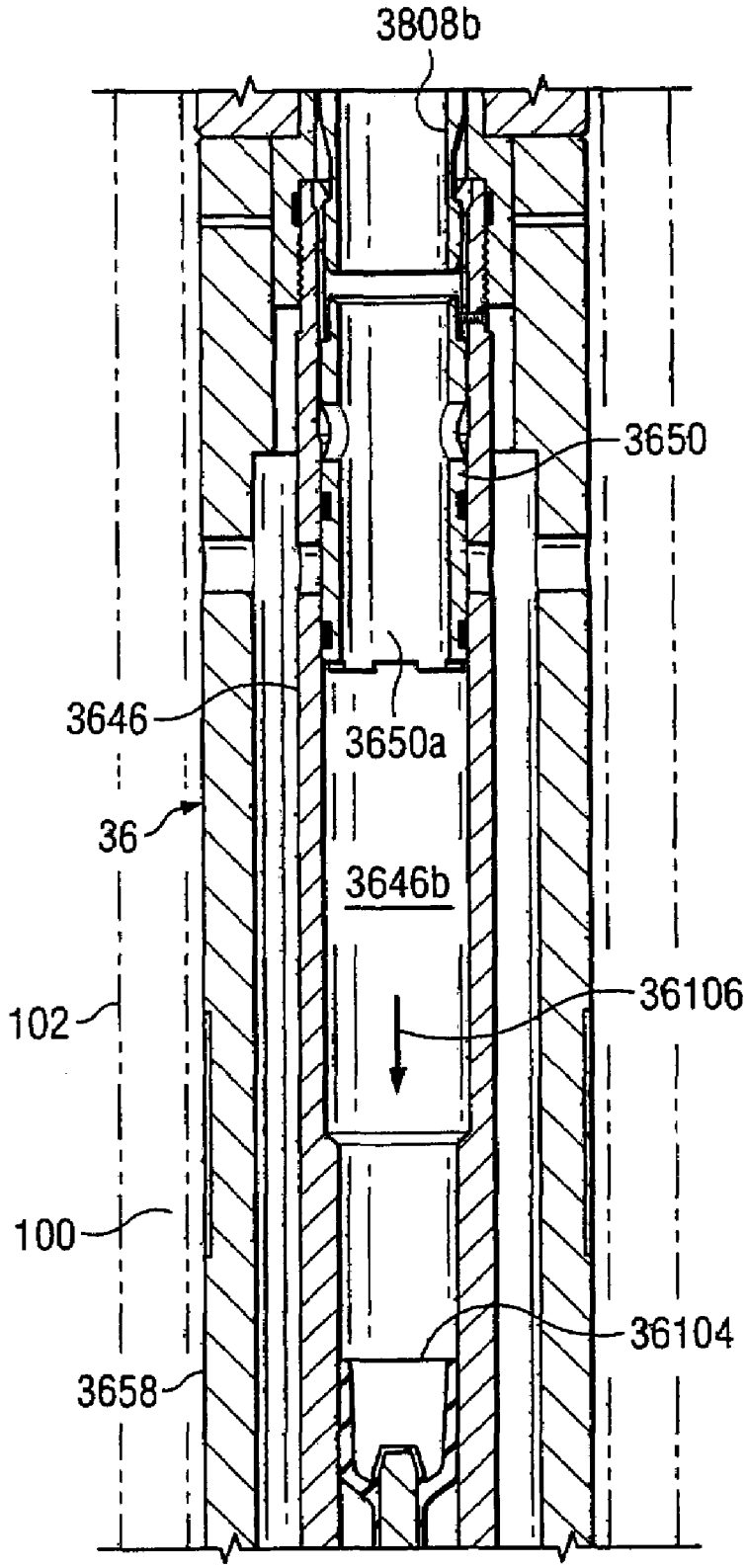
Figure 25E:
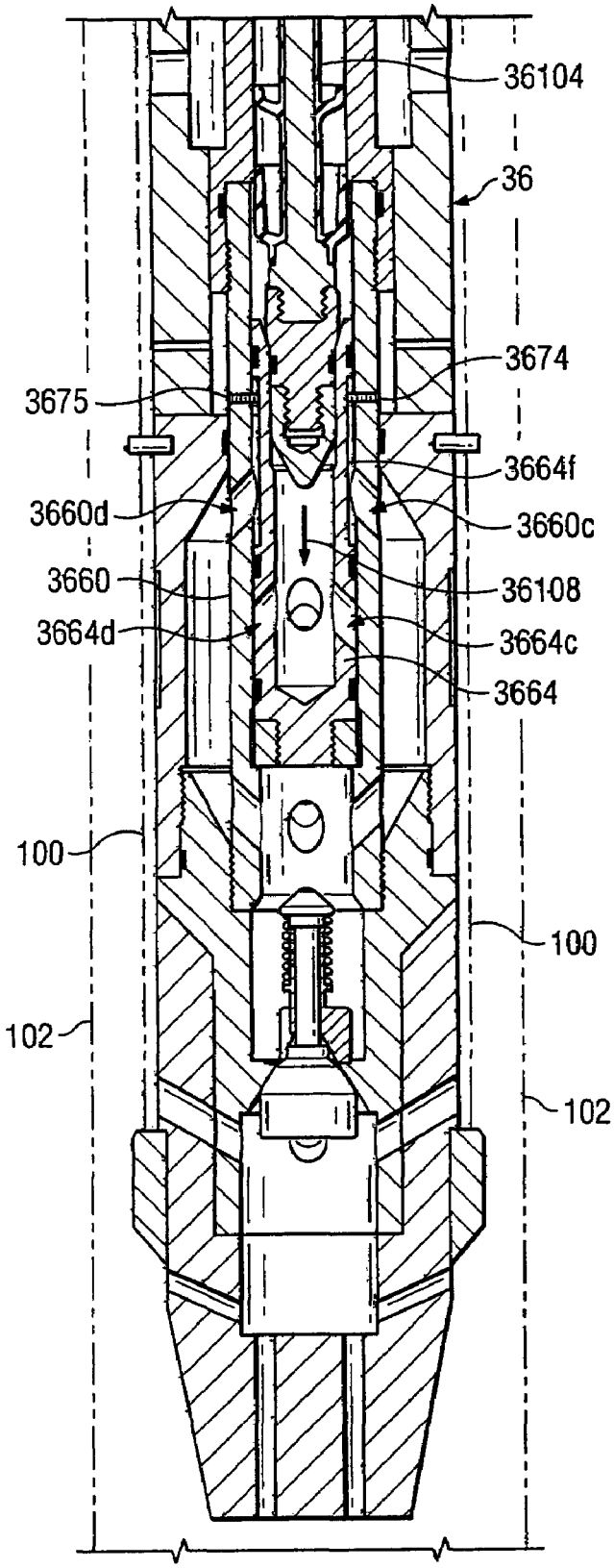
Figure 26A:
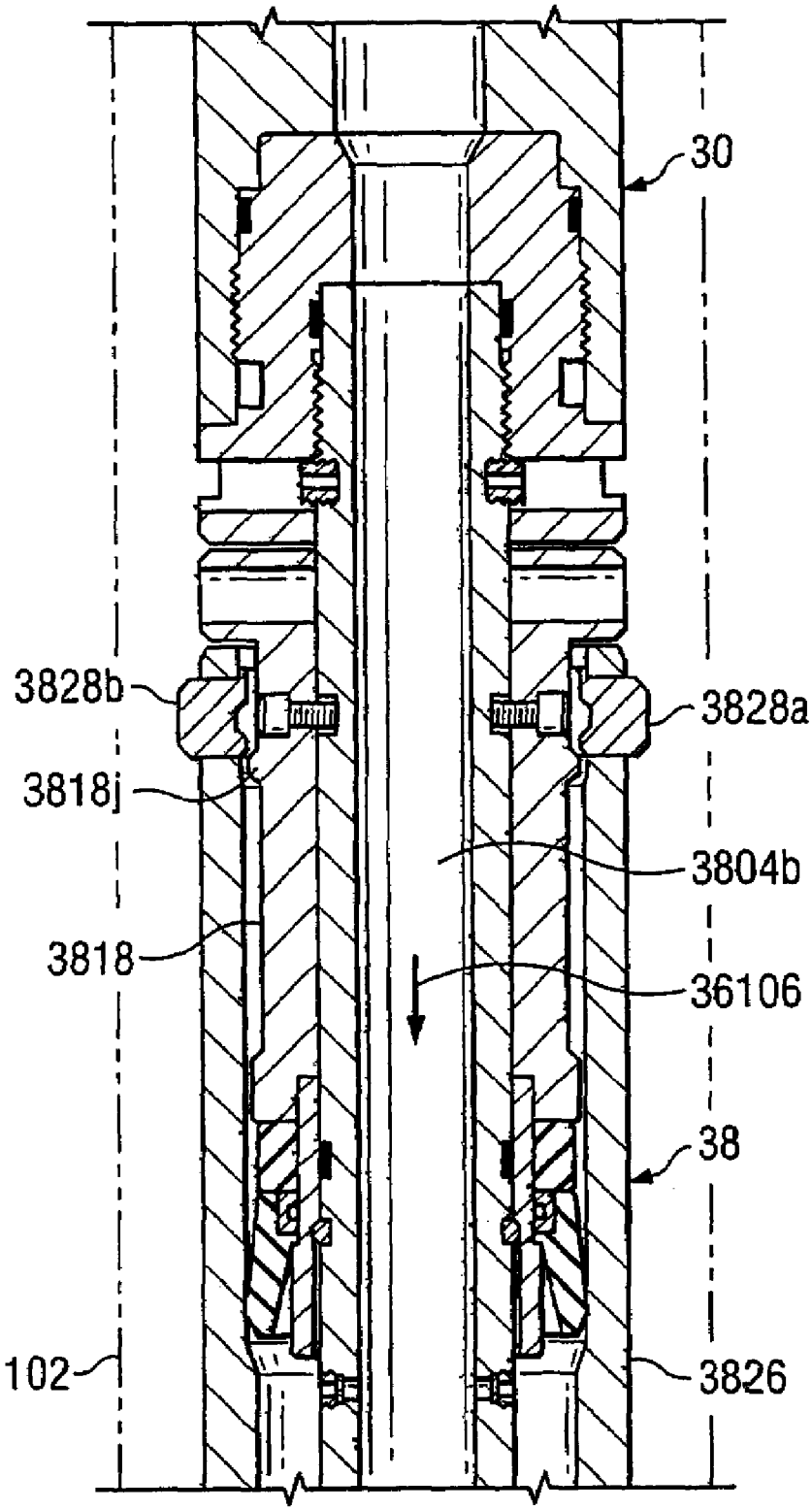
Figure 26B:
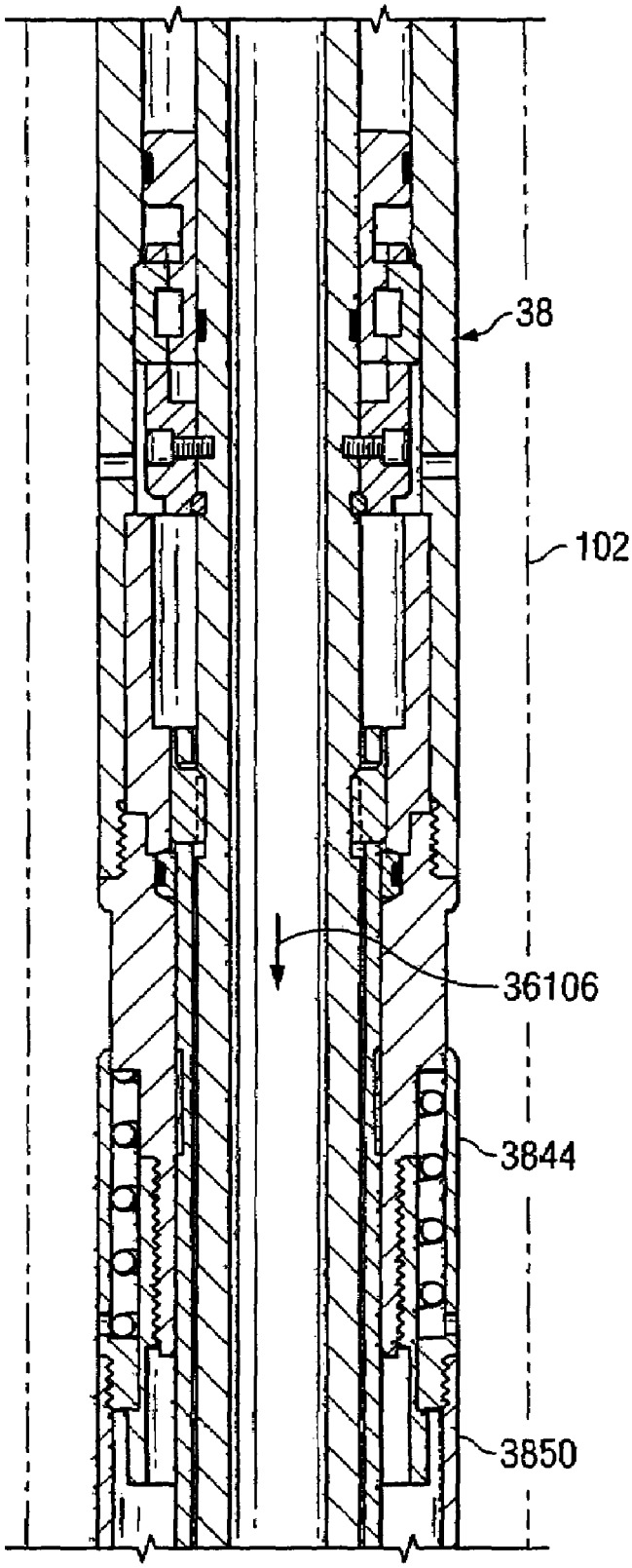
Figure 26C:
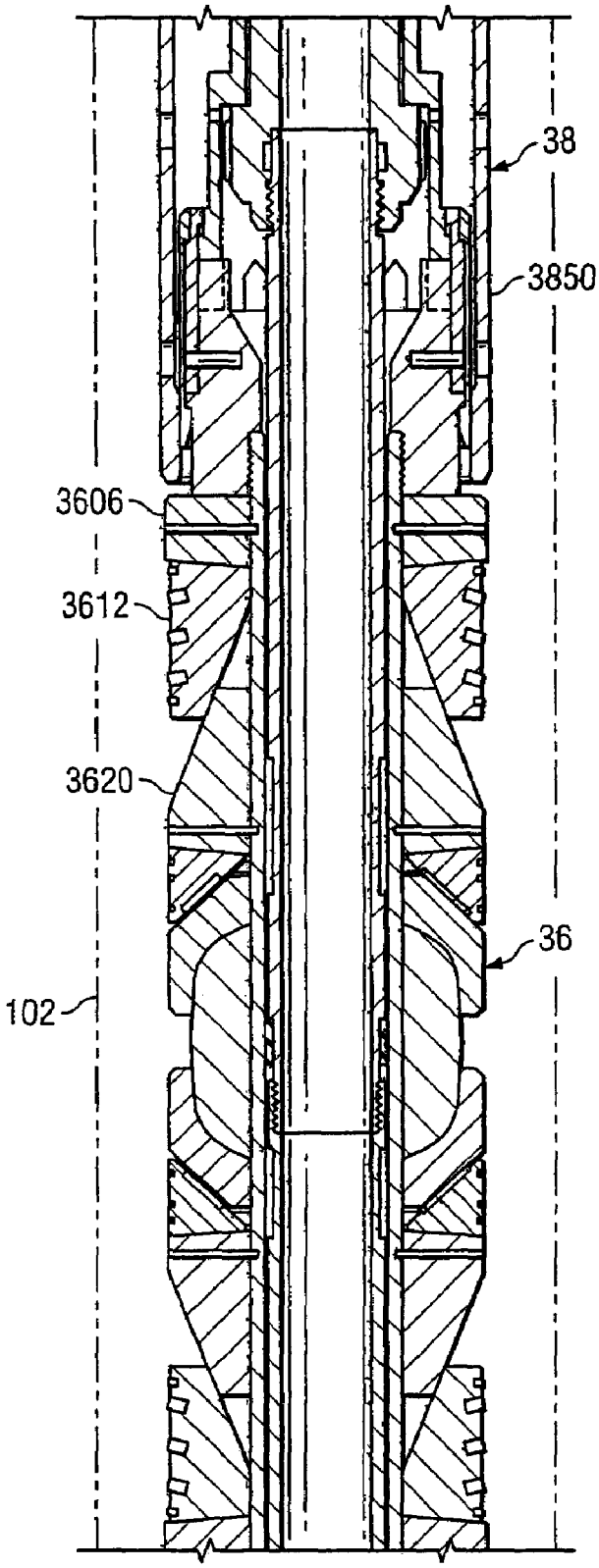
Figure 26D:
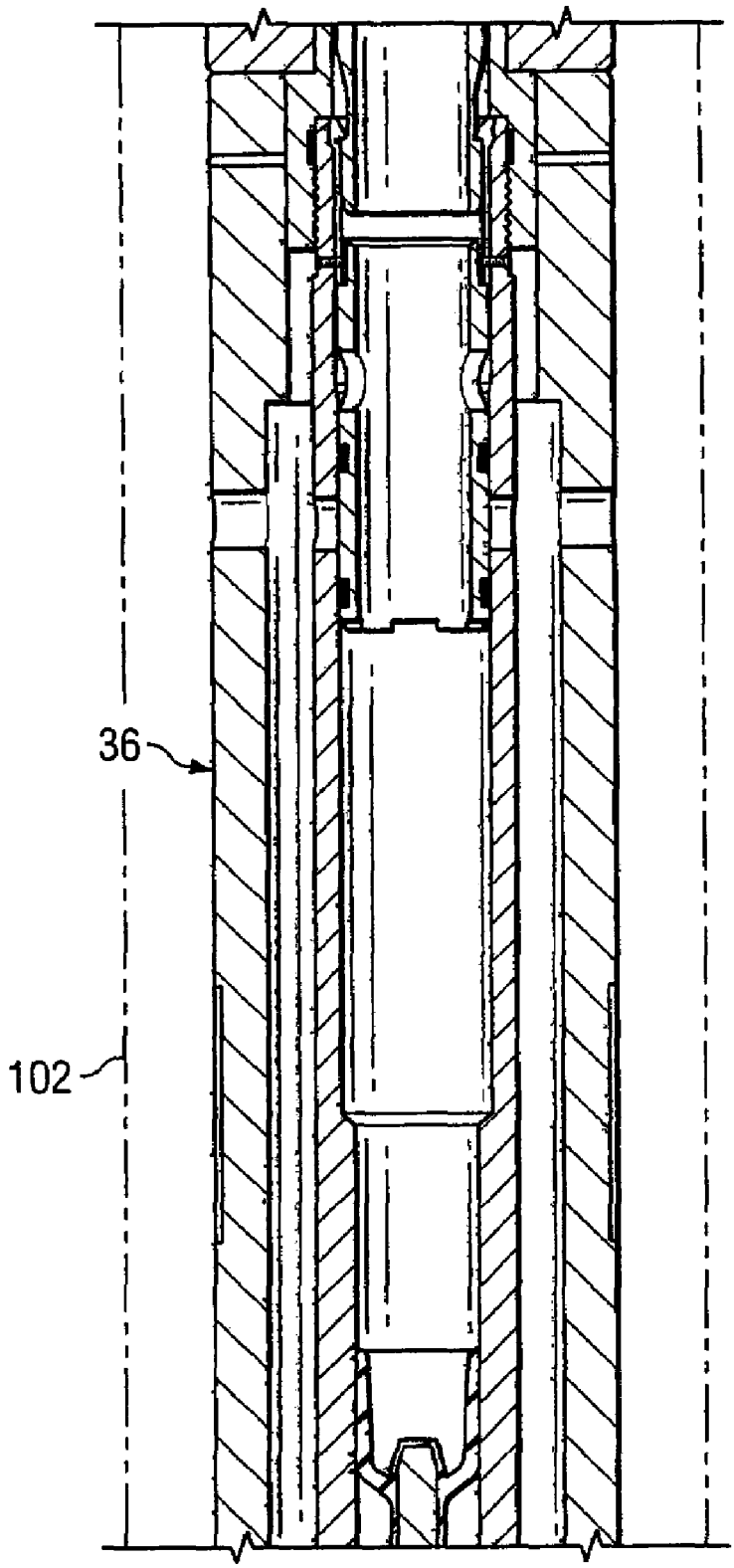
Figure 26E:
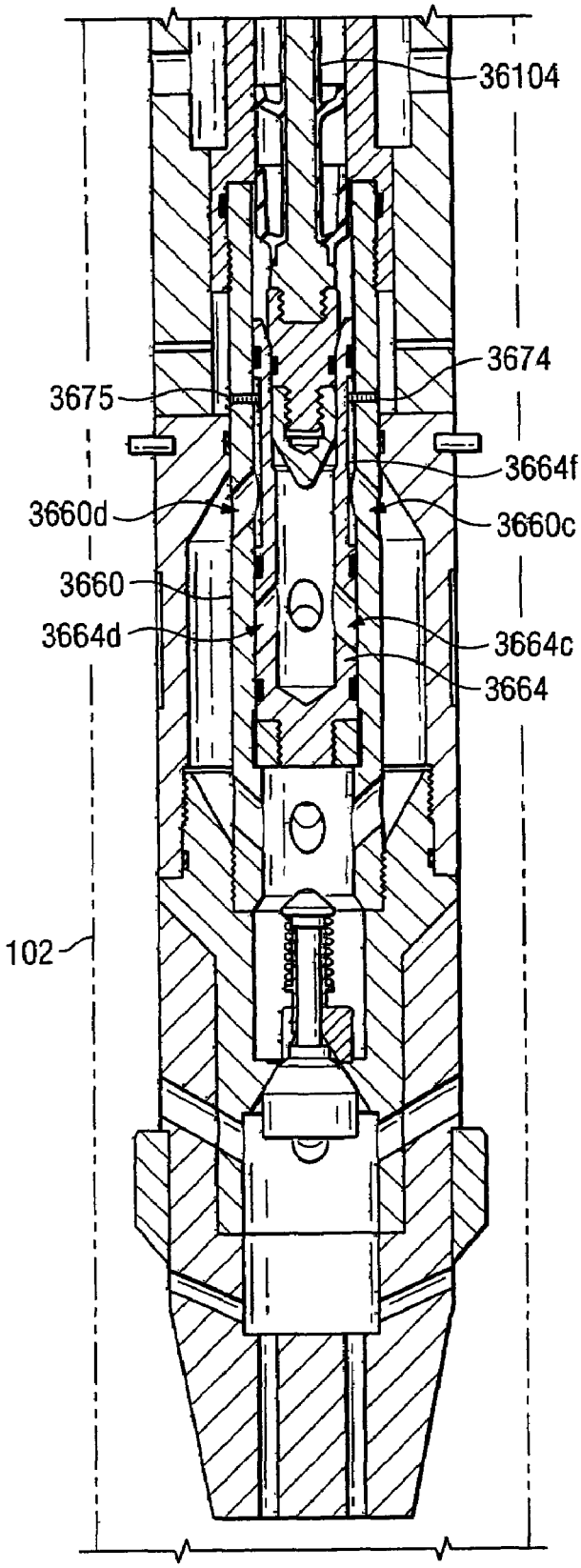
Figure 27A:
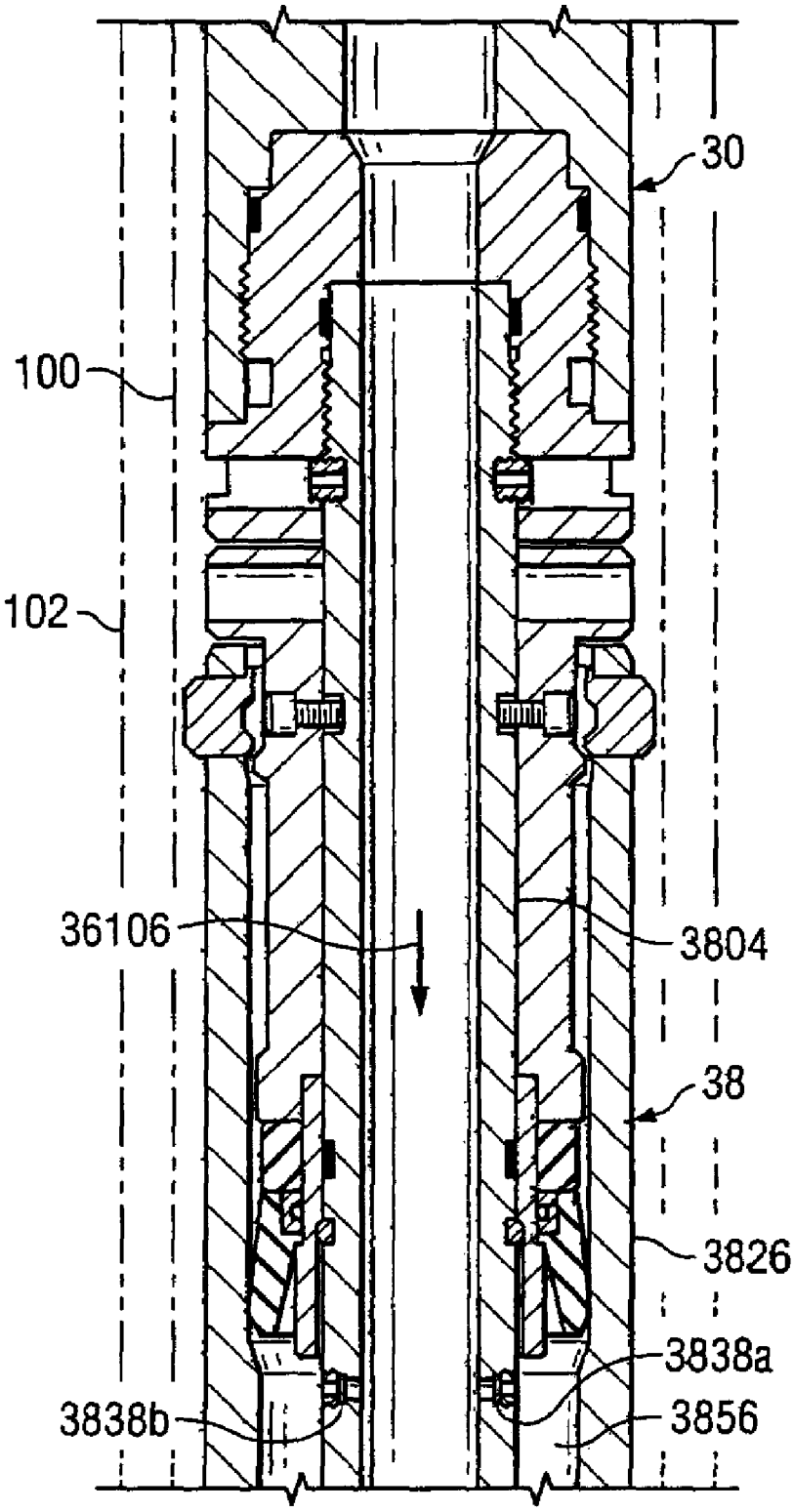
Figure 27B:
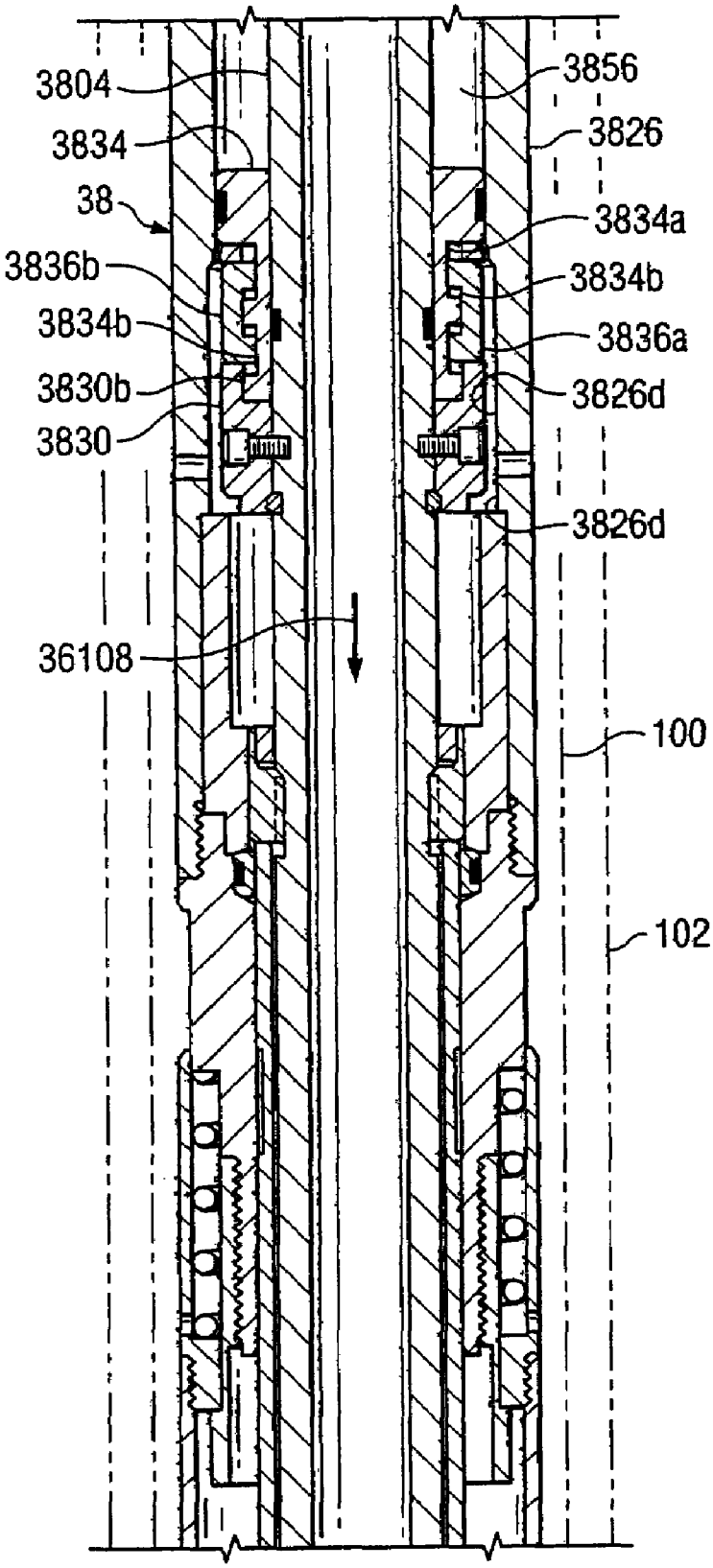
Figure 27C:
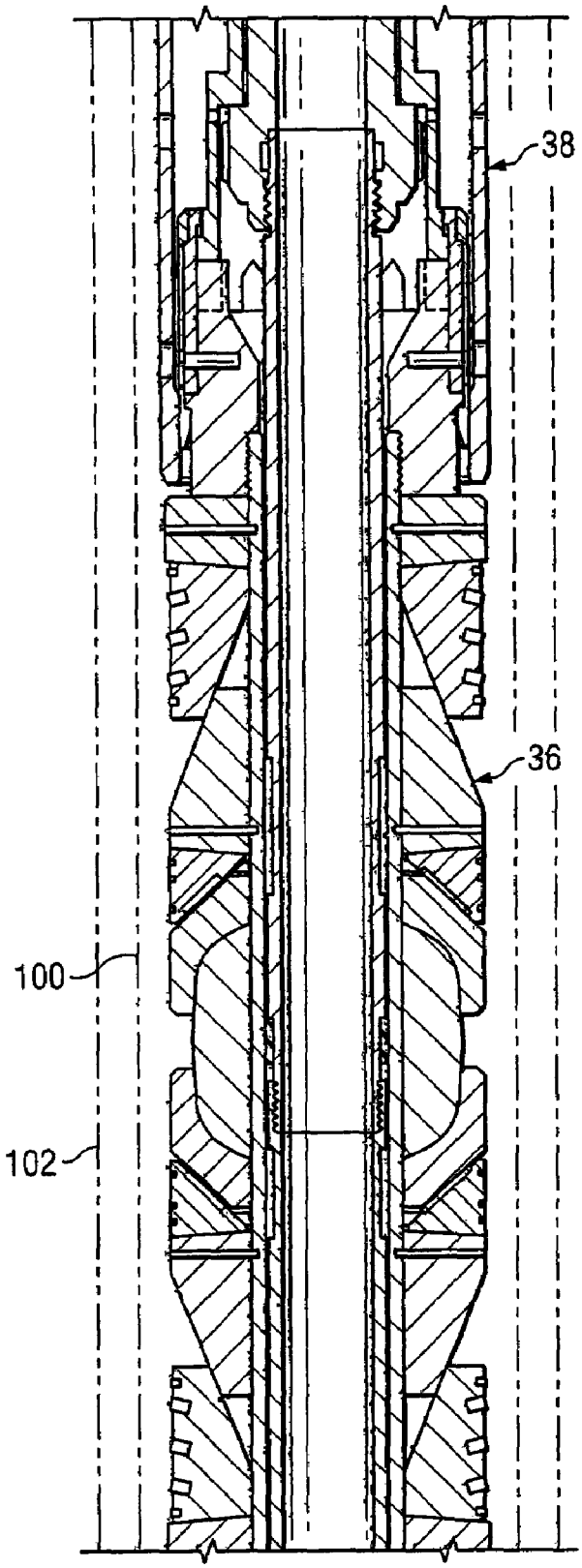
Figure 27D:
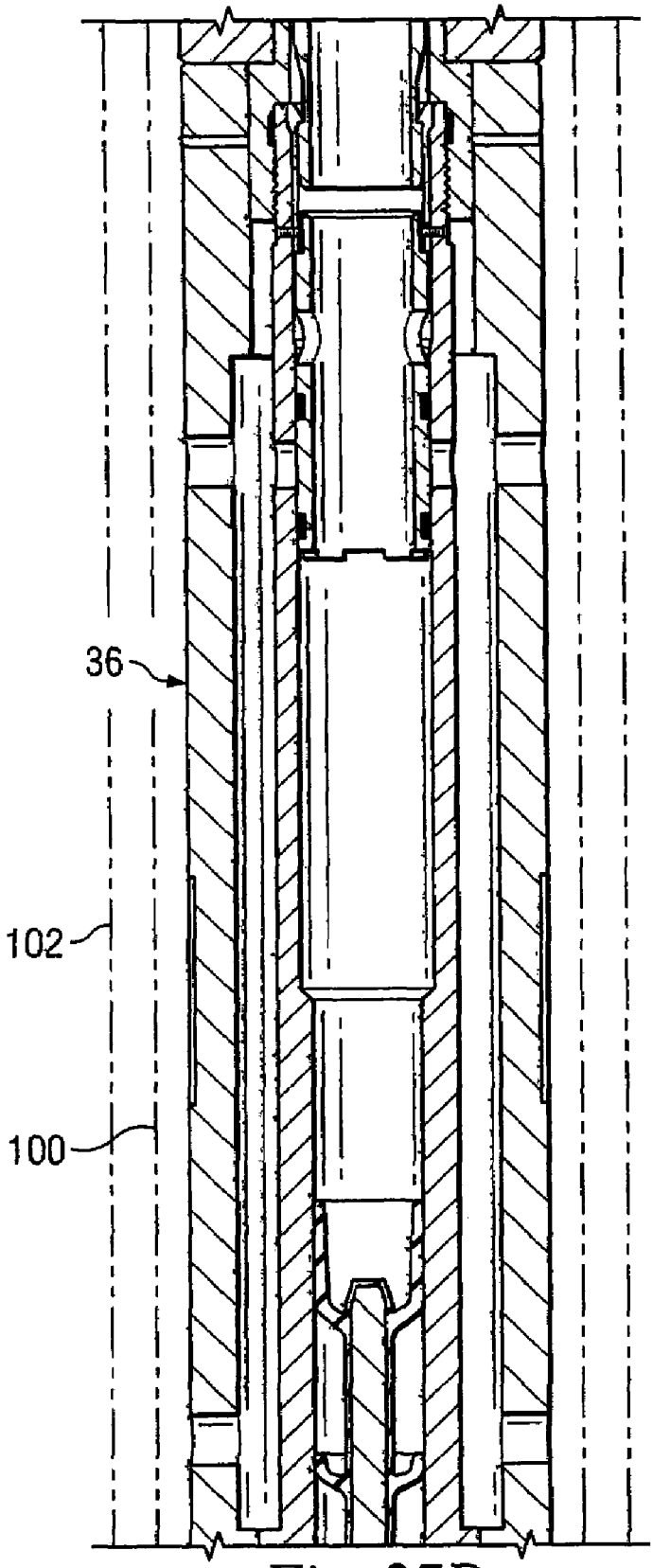
Figure 27E:
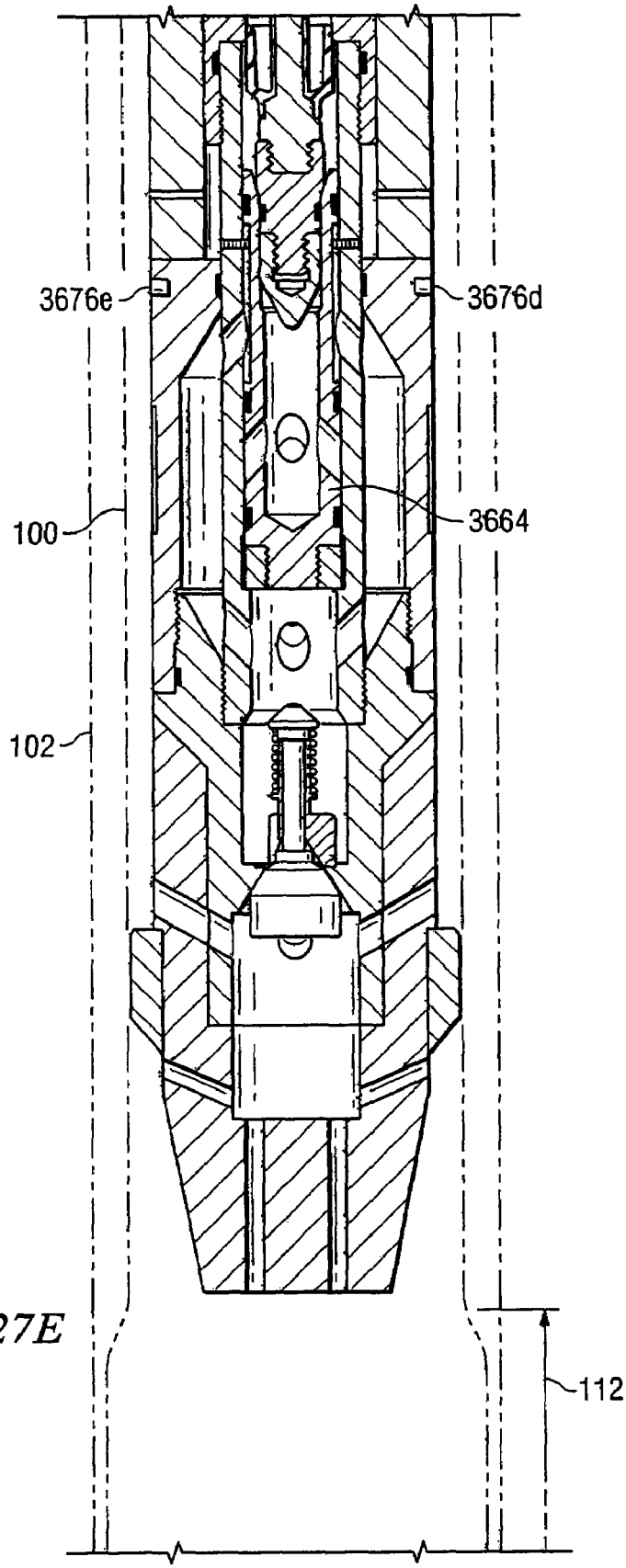
Figure 28A:
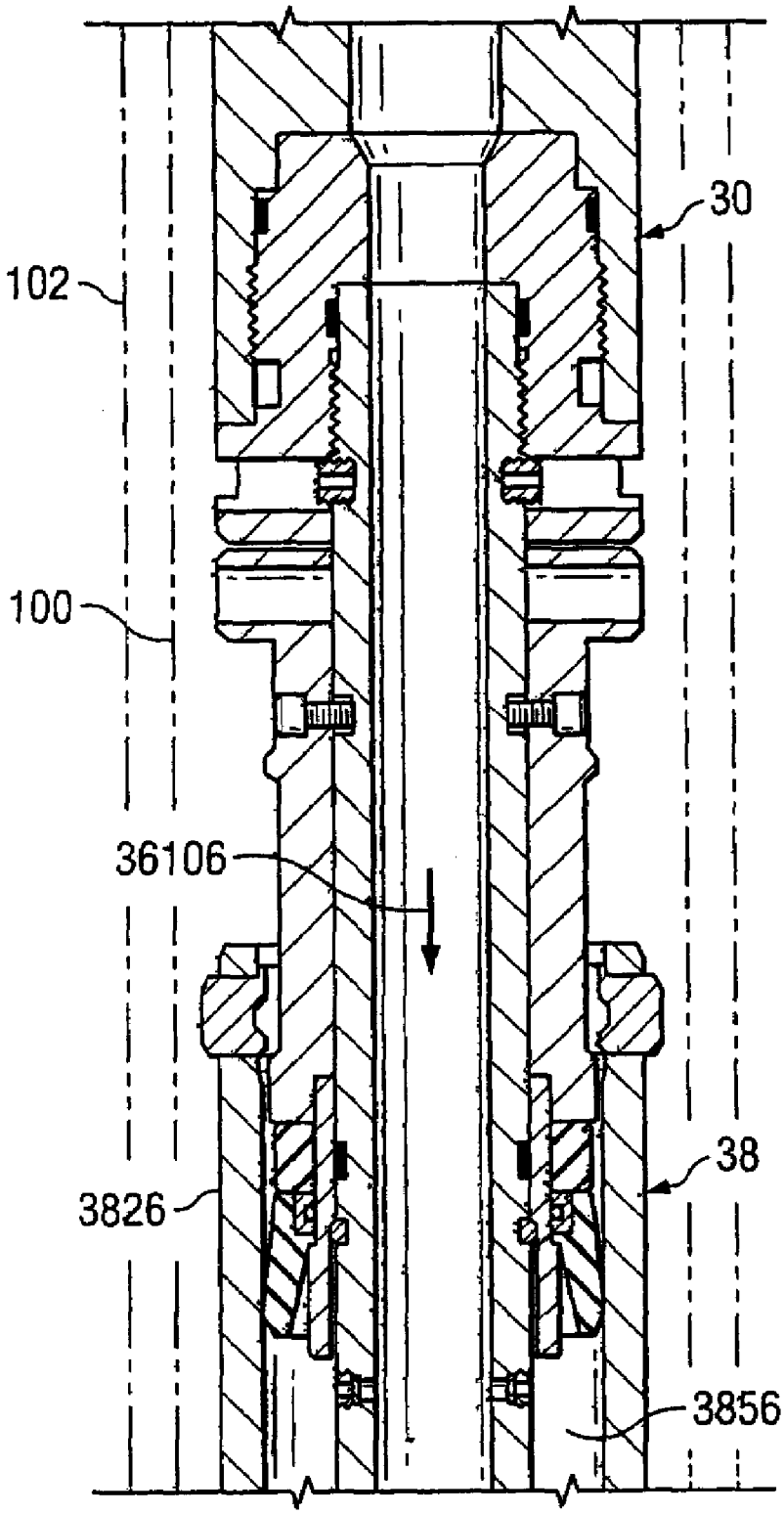
Figure 28B:
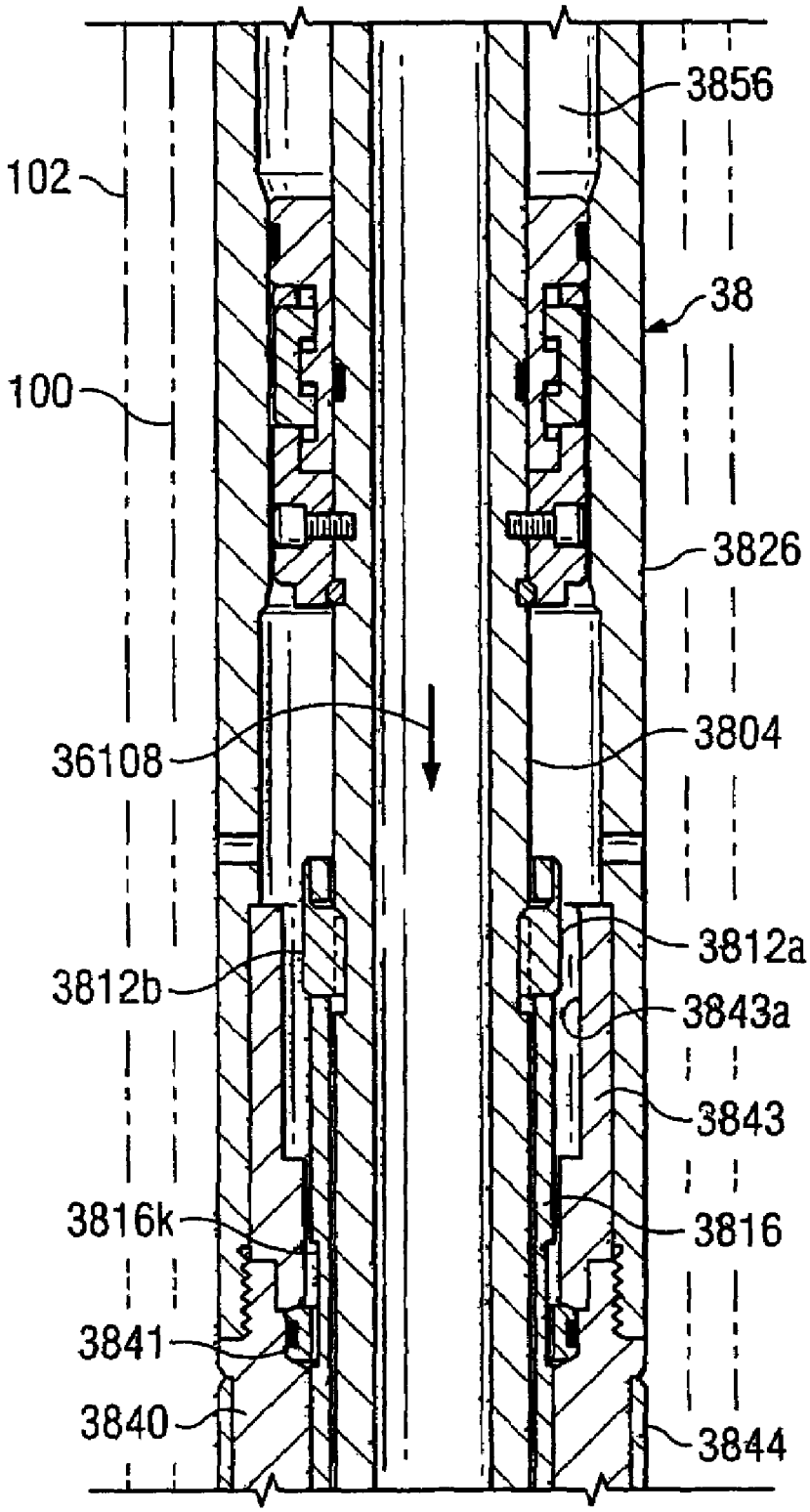
Figure 28C:
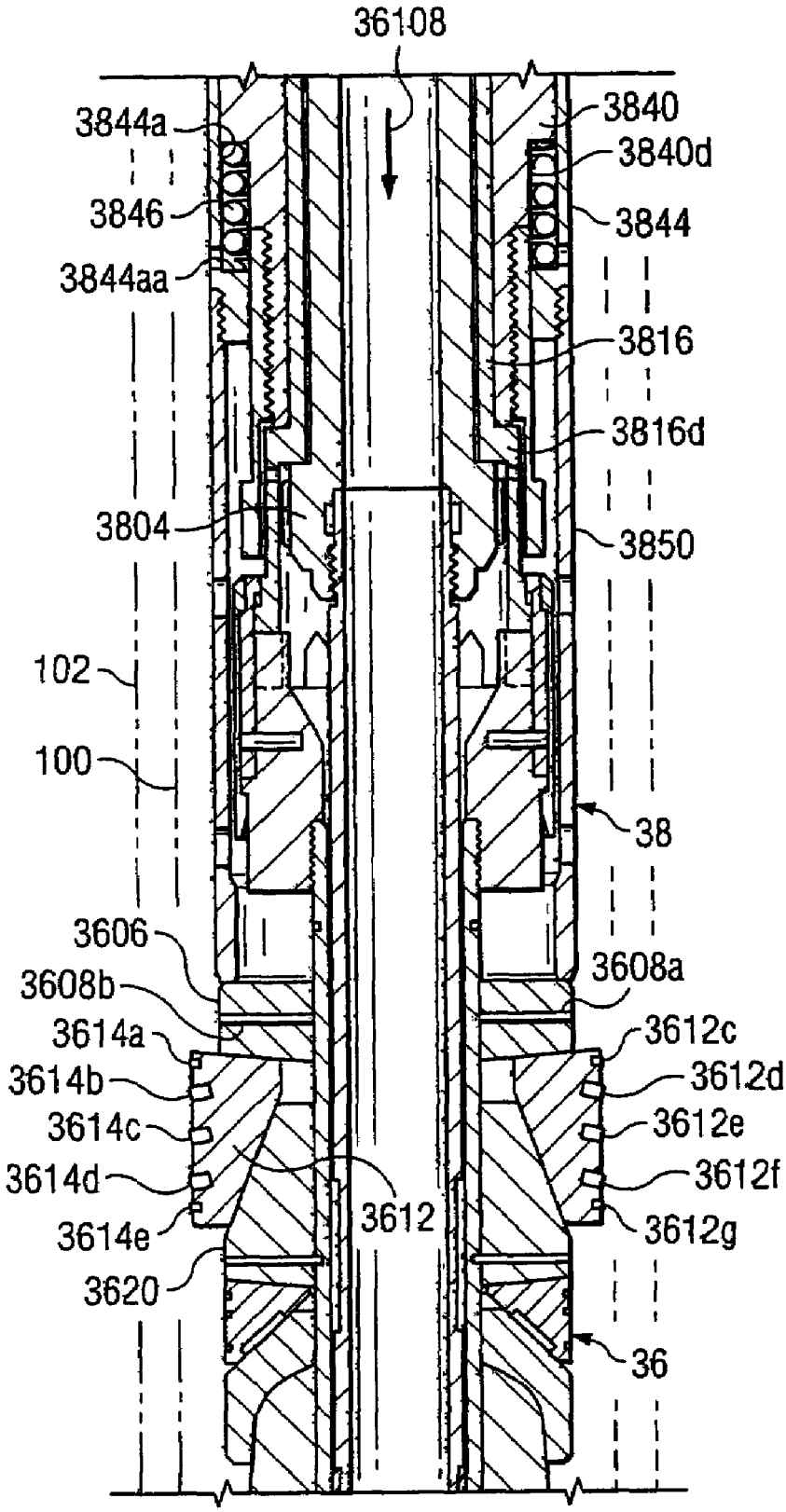
Figure 28D:
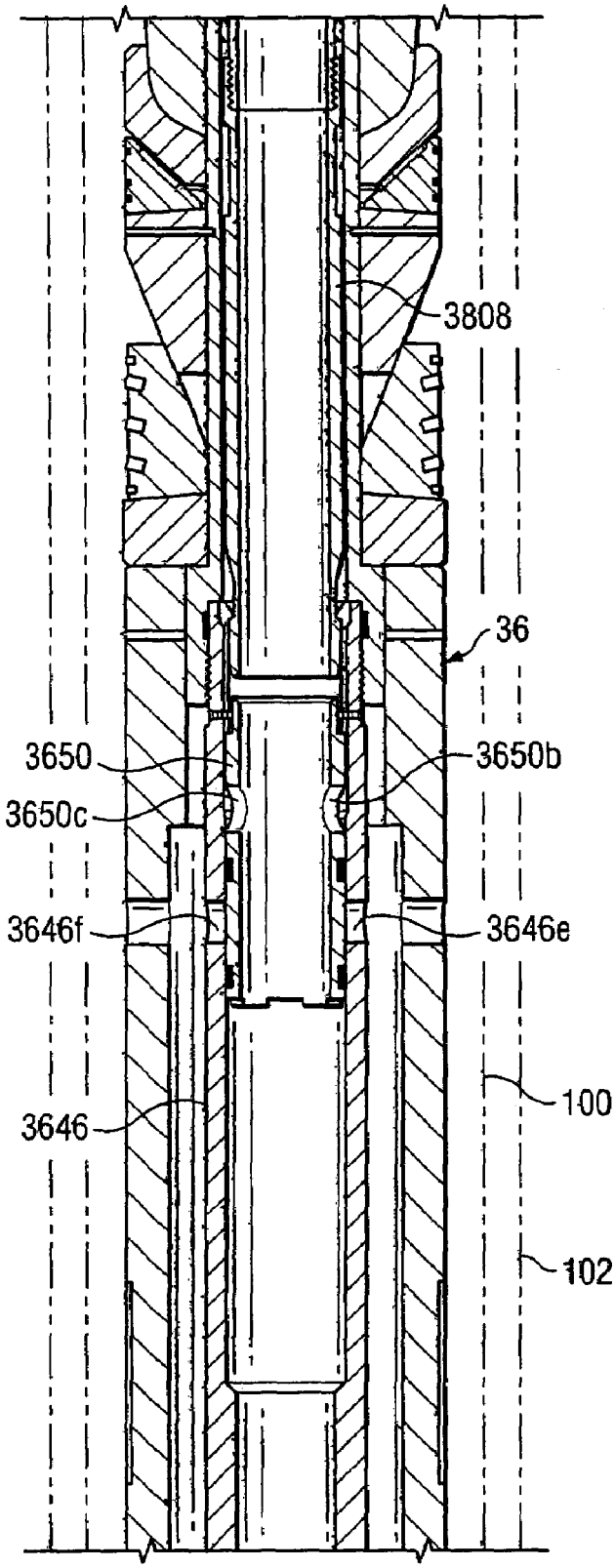
Figure 28E:
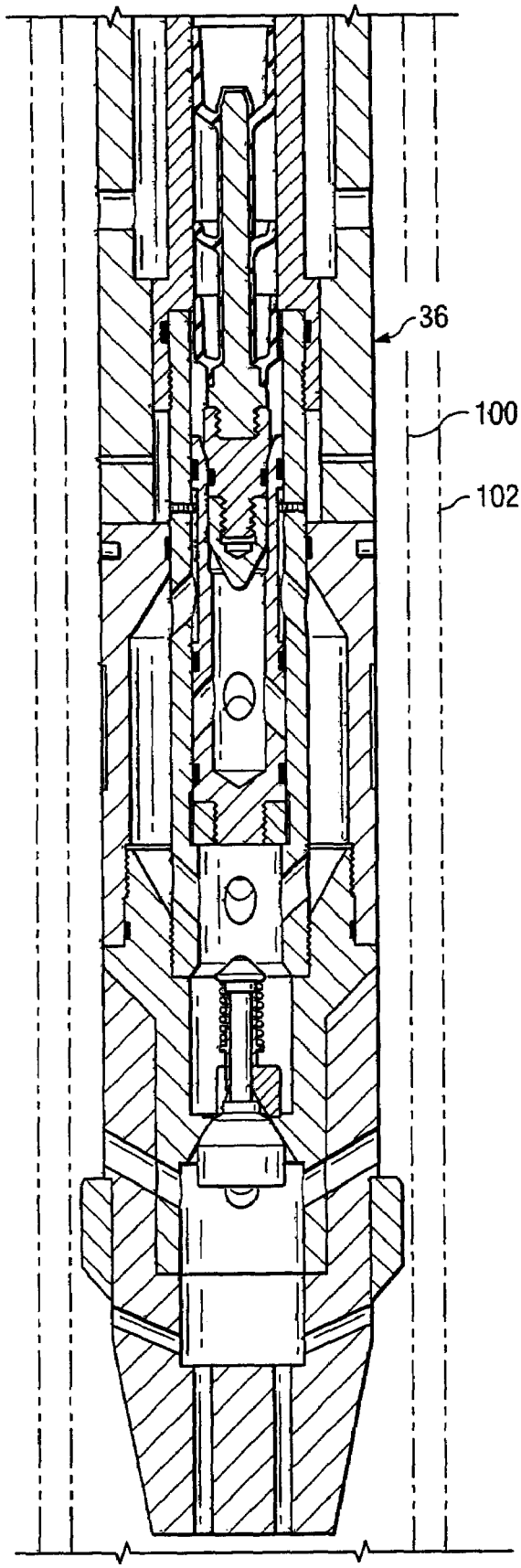
Figure 29A:
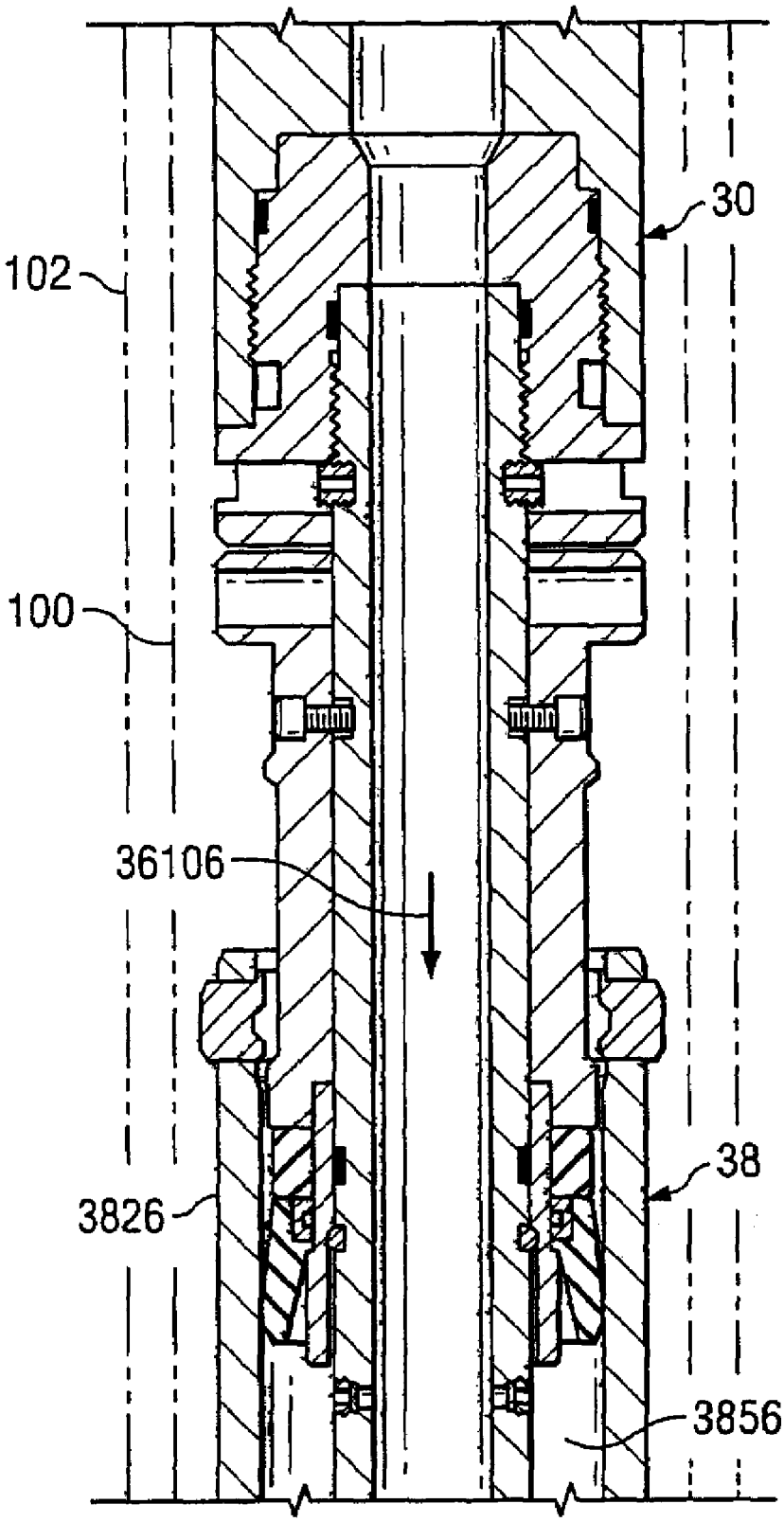
Figure 29B:
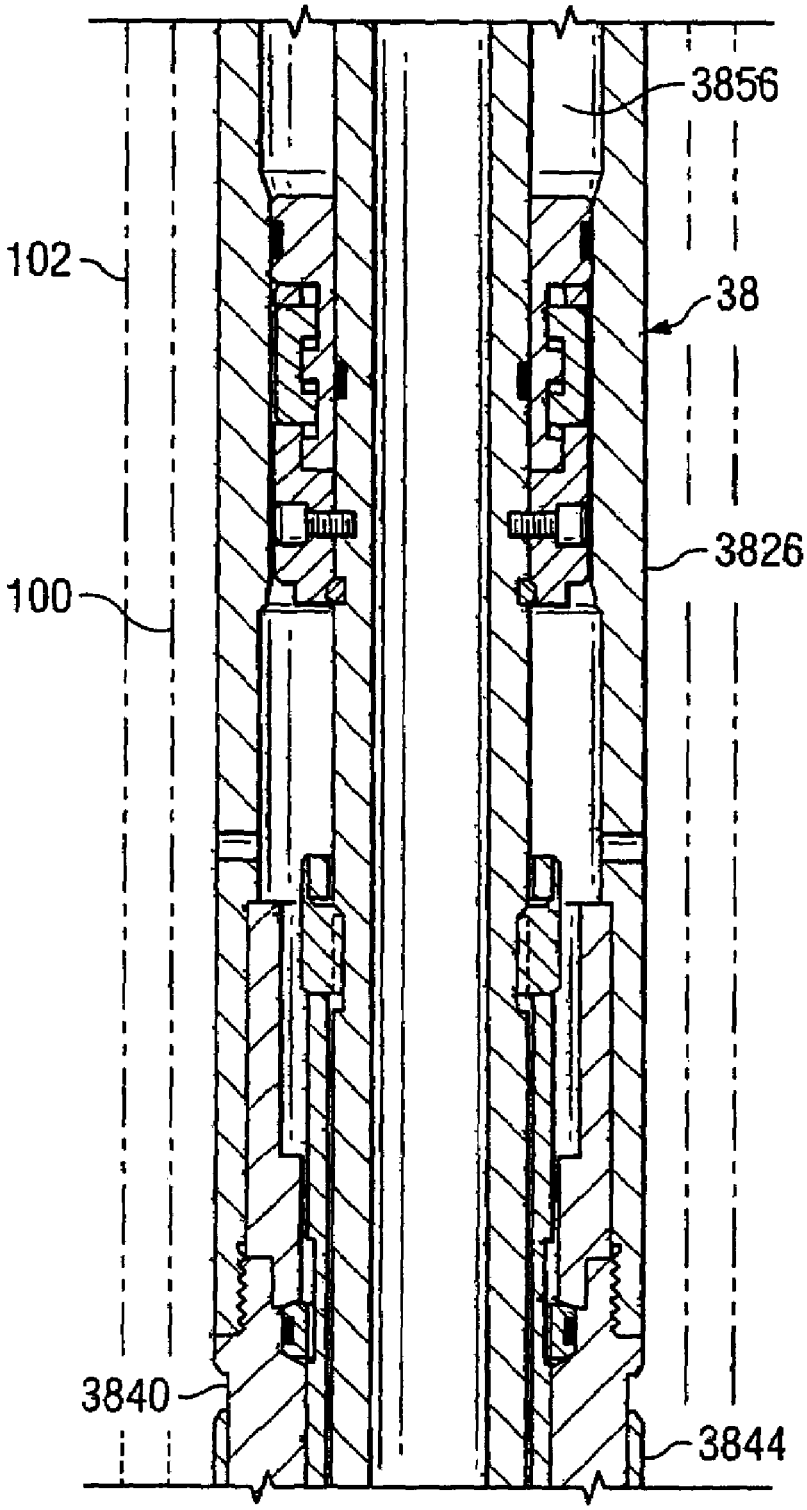
Figure 29C:
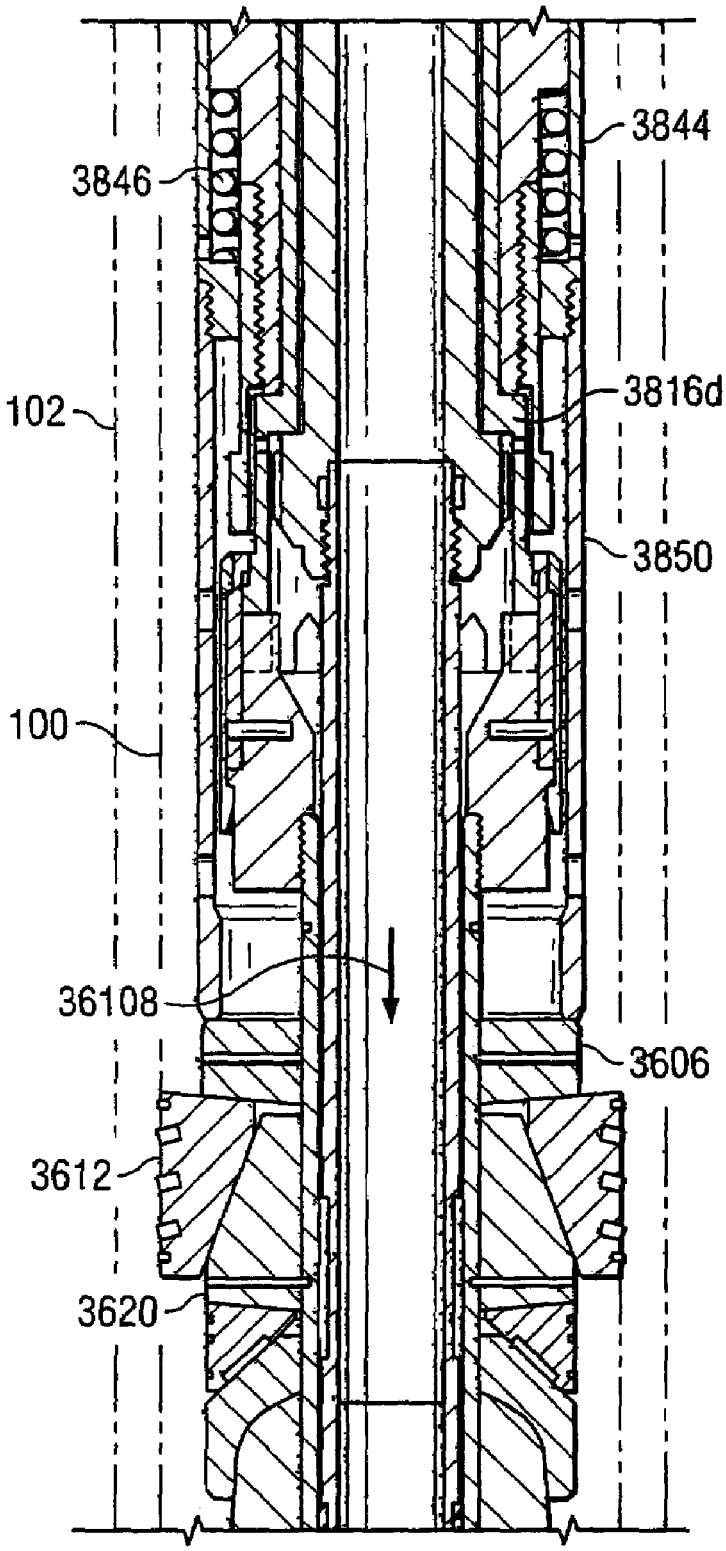
Figure 29D:
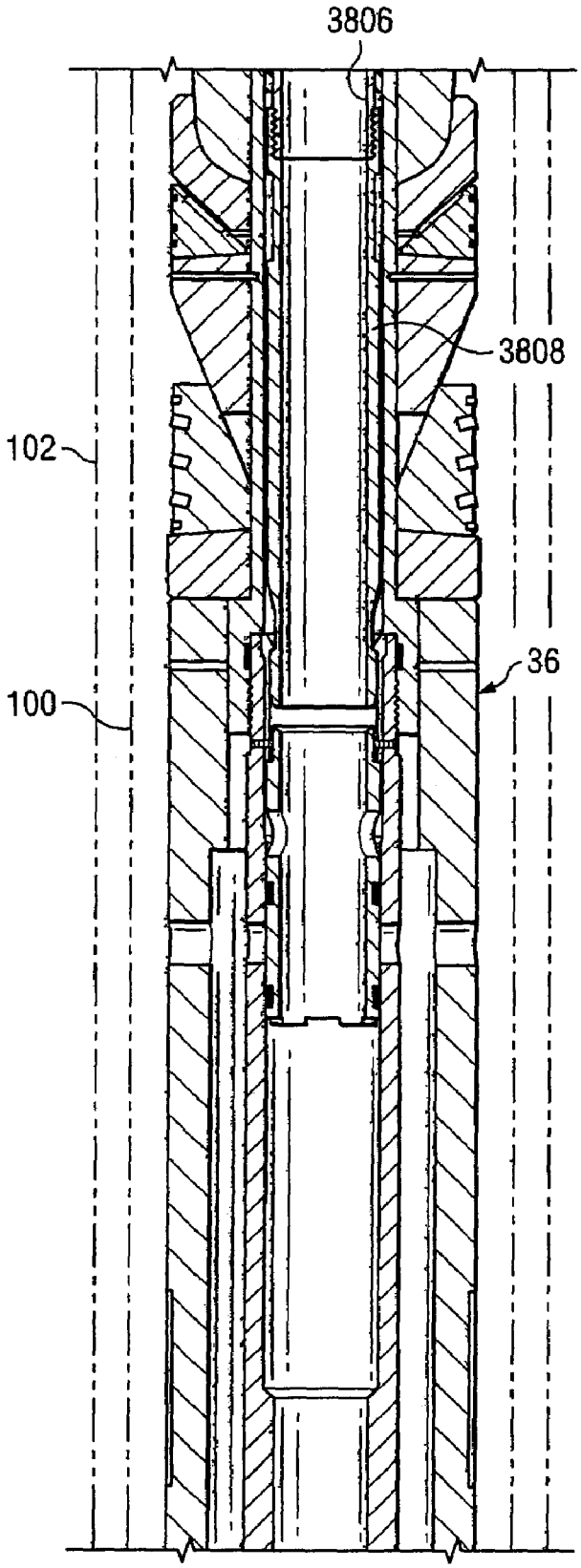
Figure 29E:
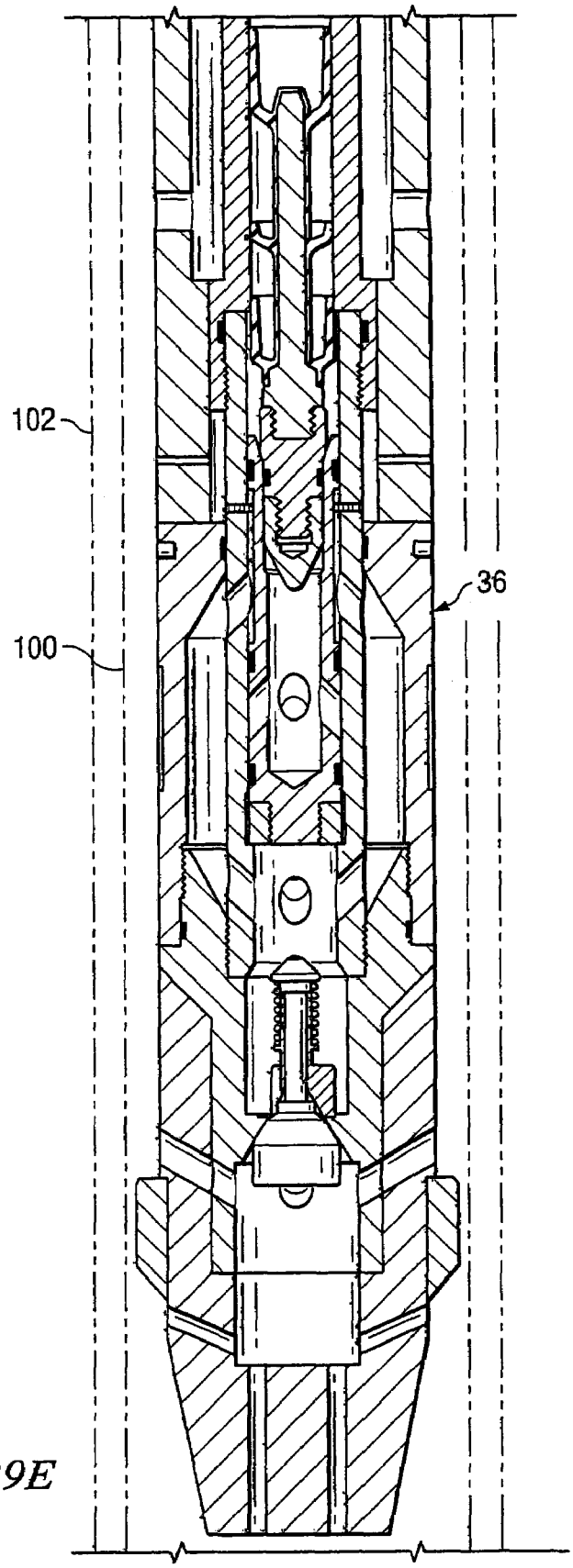
Figure 30A:
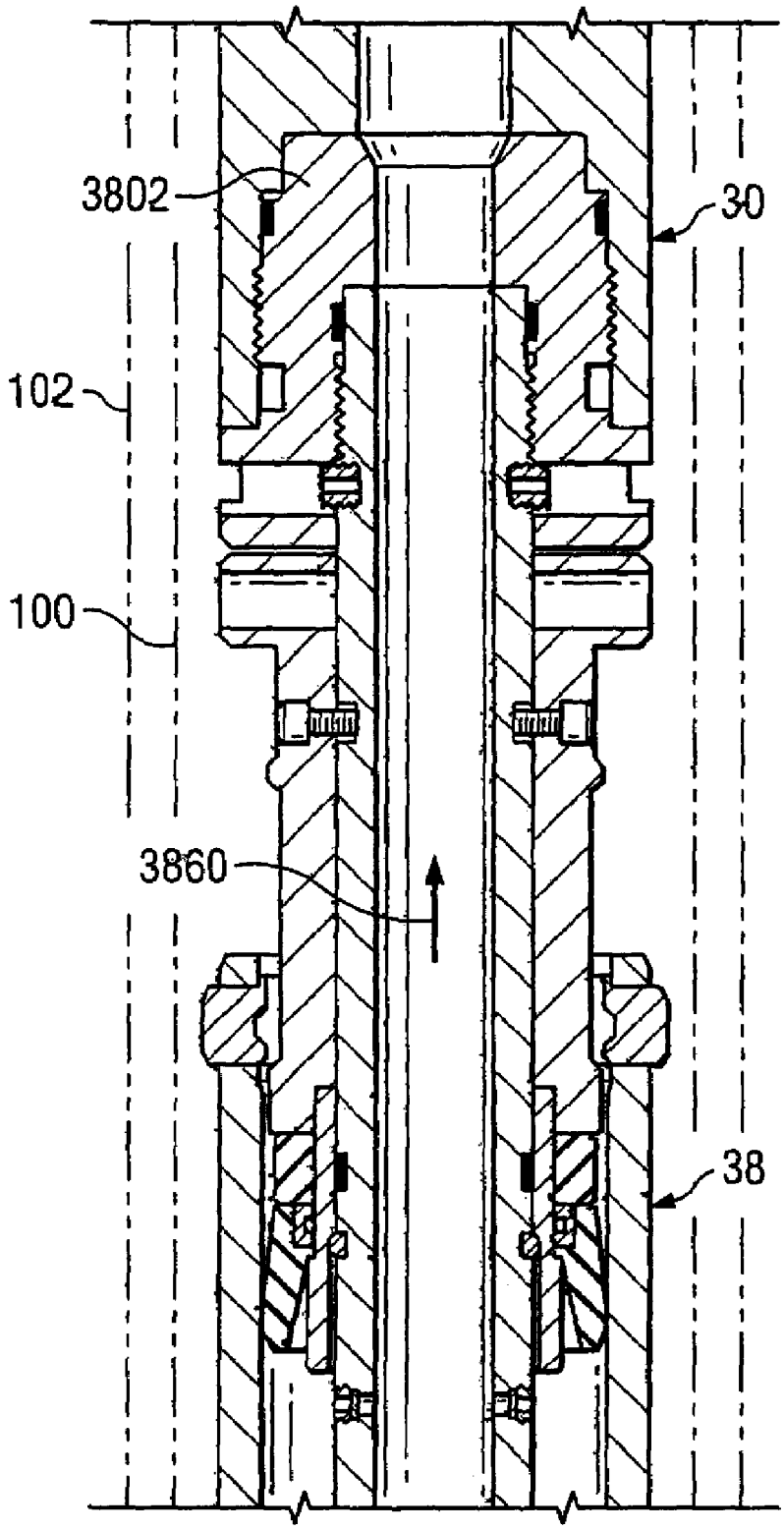
Figure 30B:
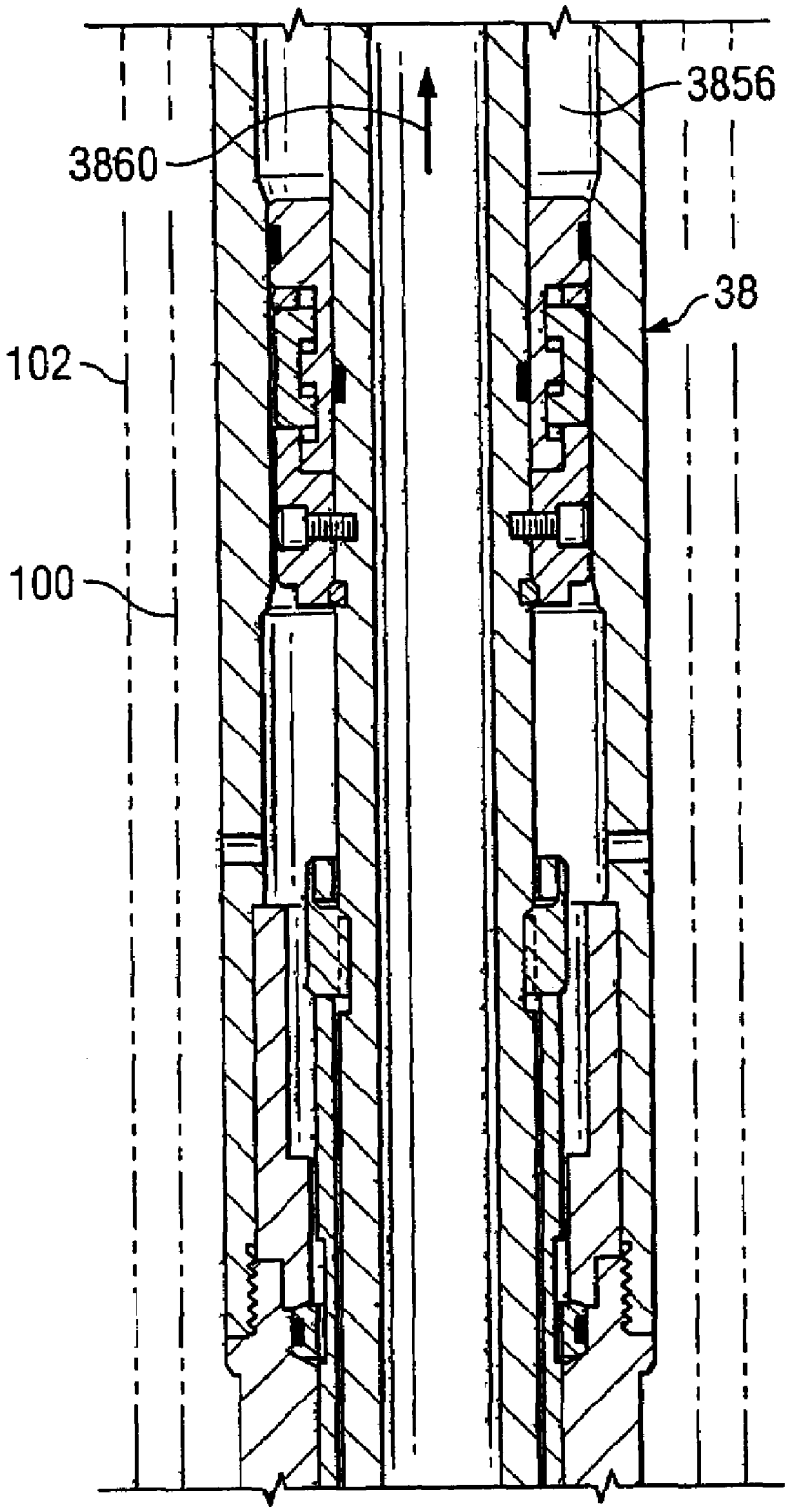
Figure 30C:
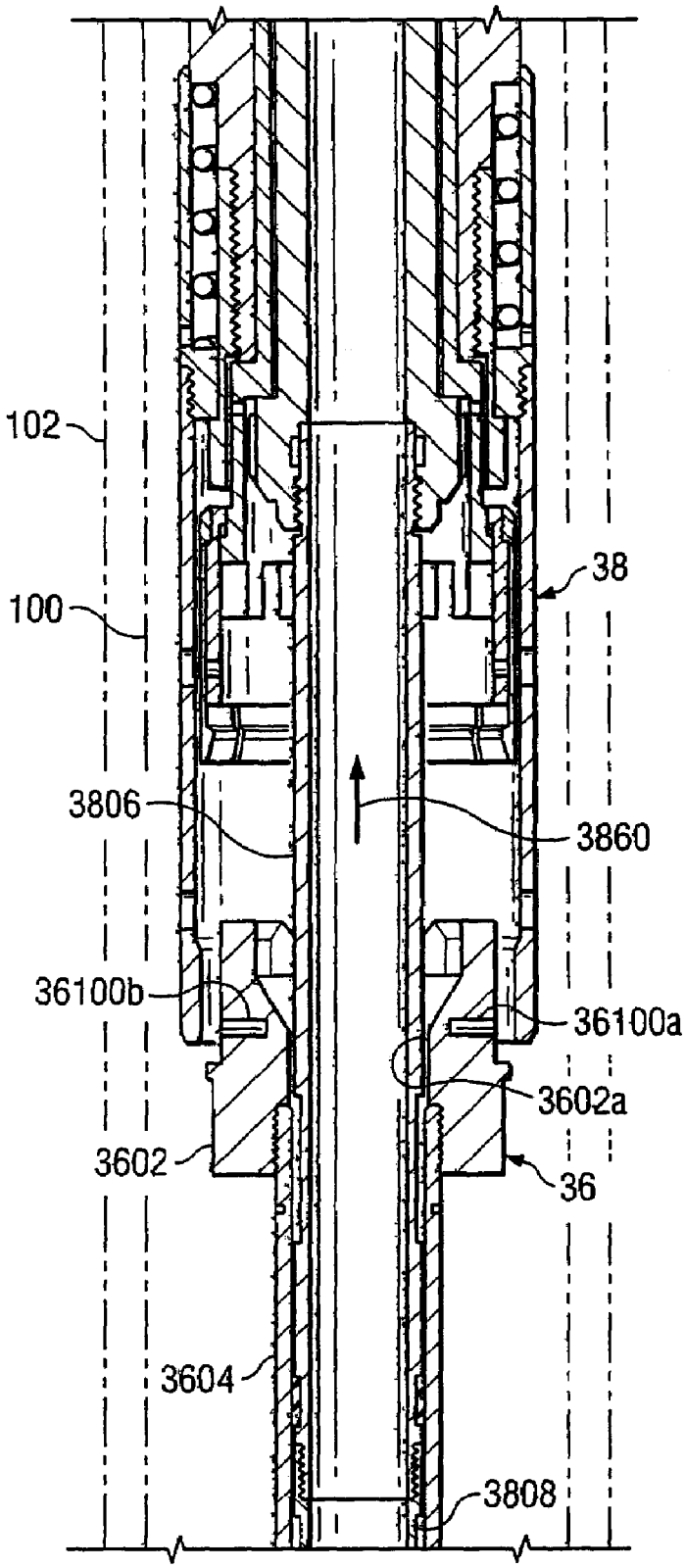
Figure 30D:
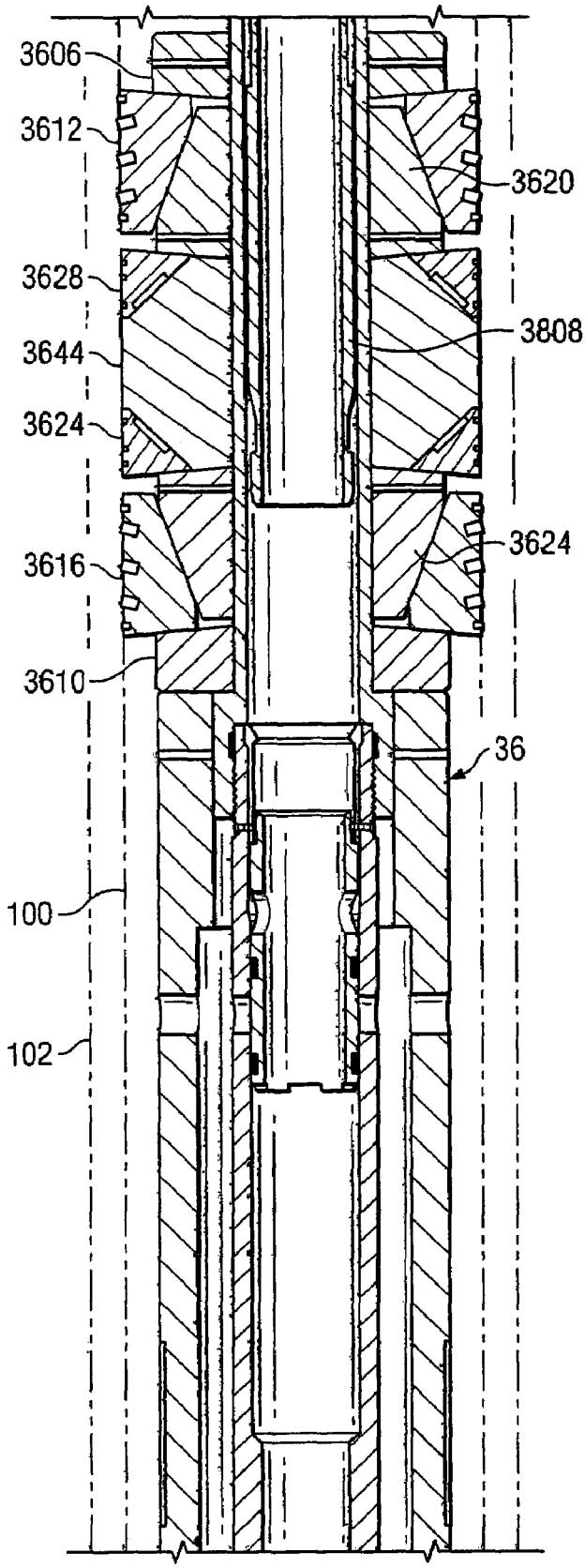
Figure 30E:
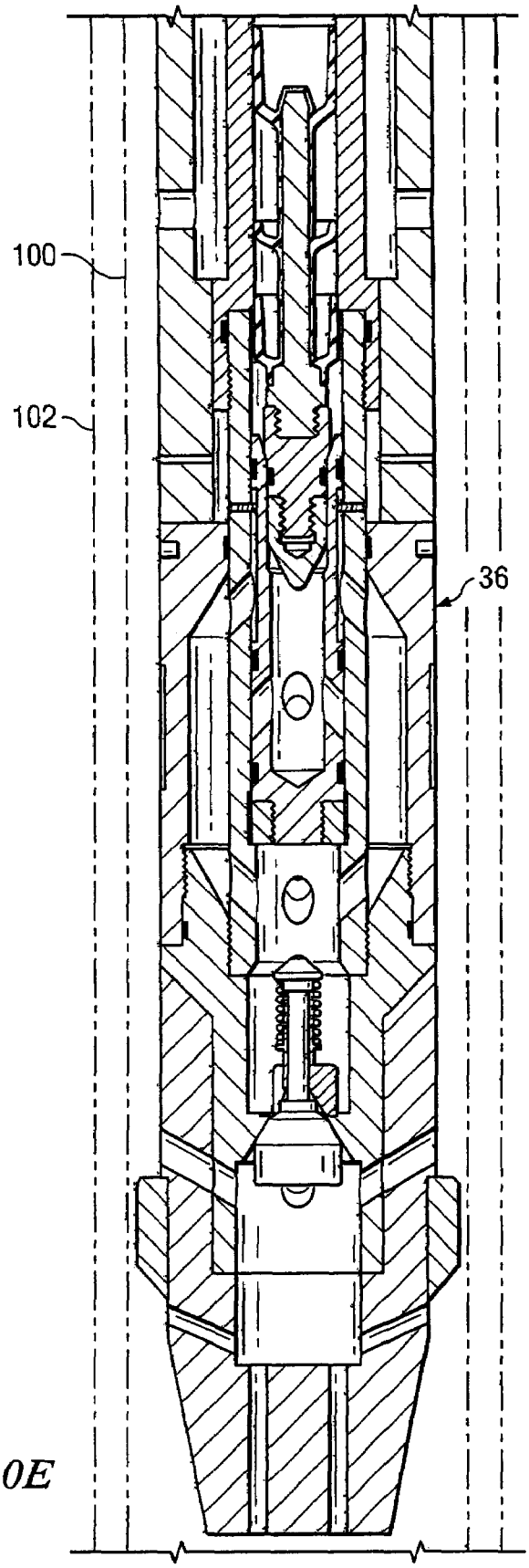
Figure 31A:
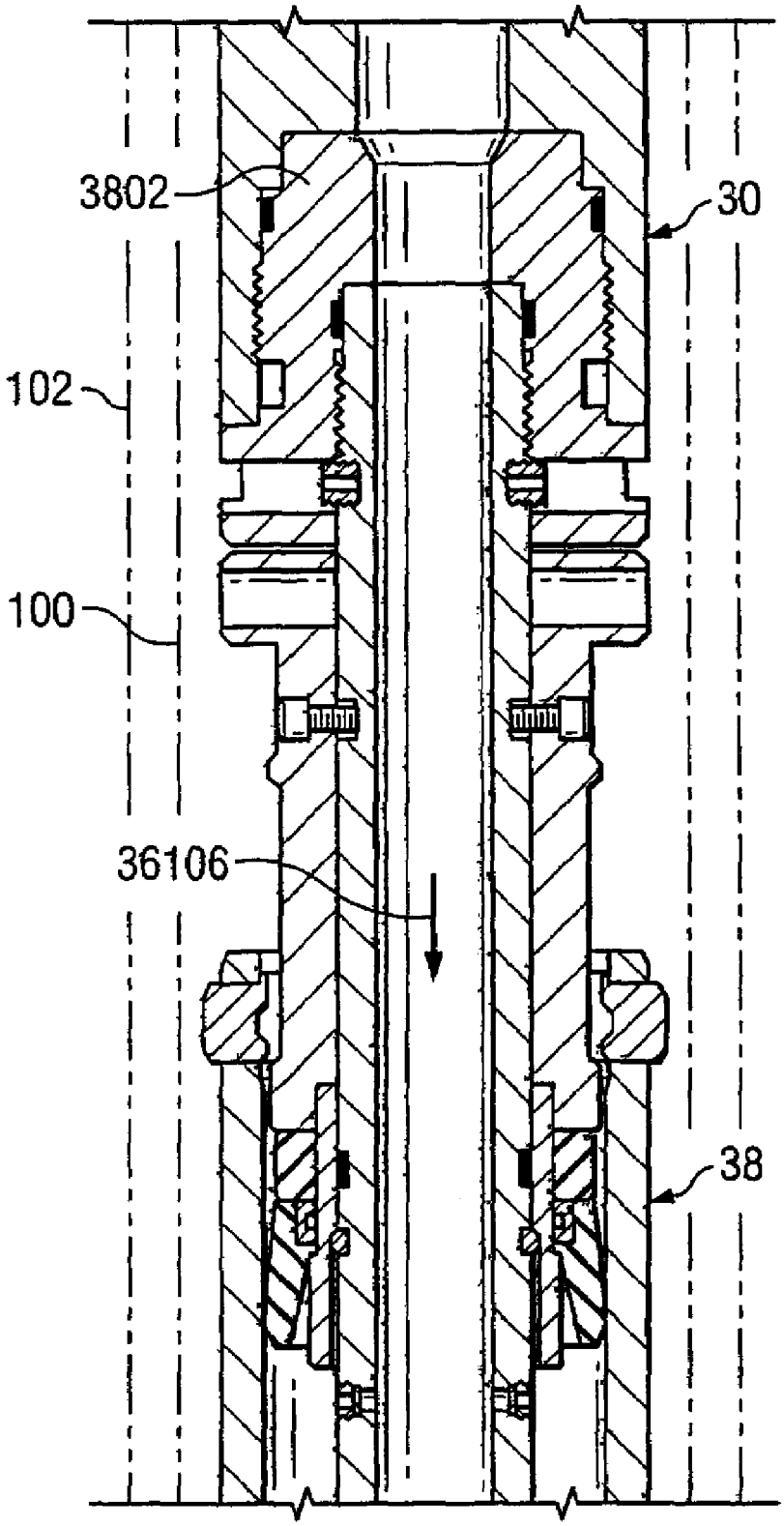
Figure 31B:
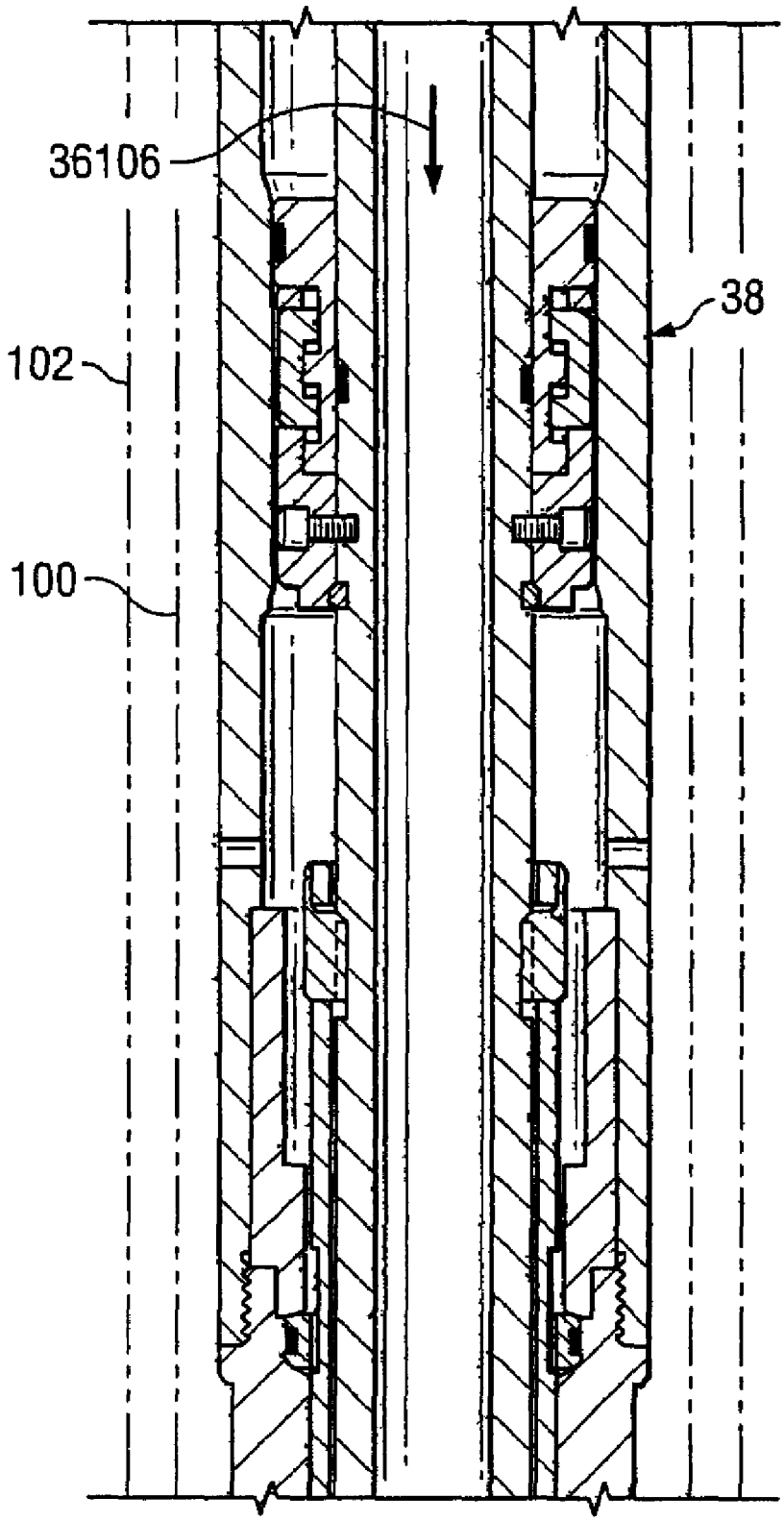
Figure 31C:
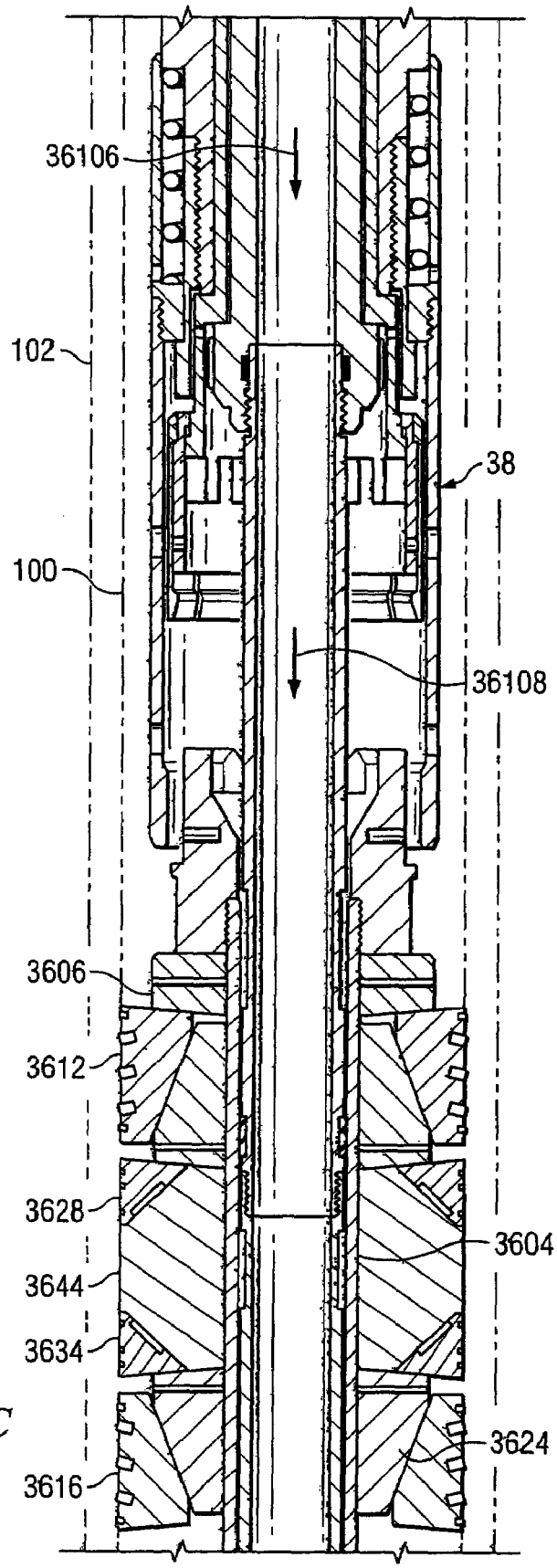
Figure 31D:
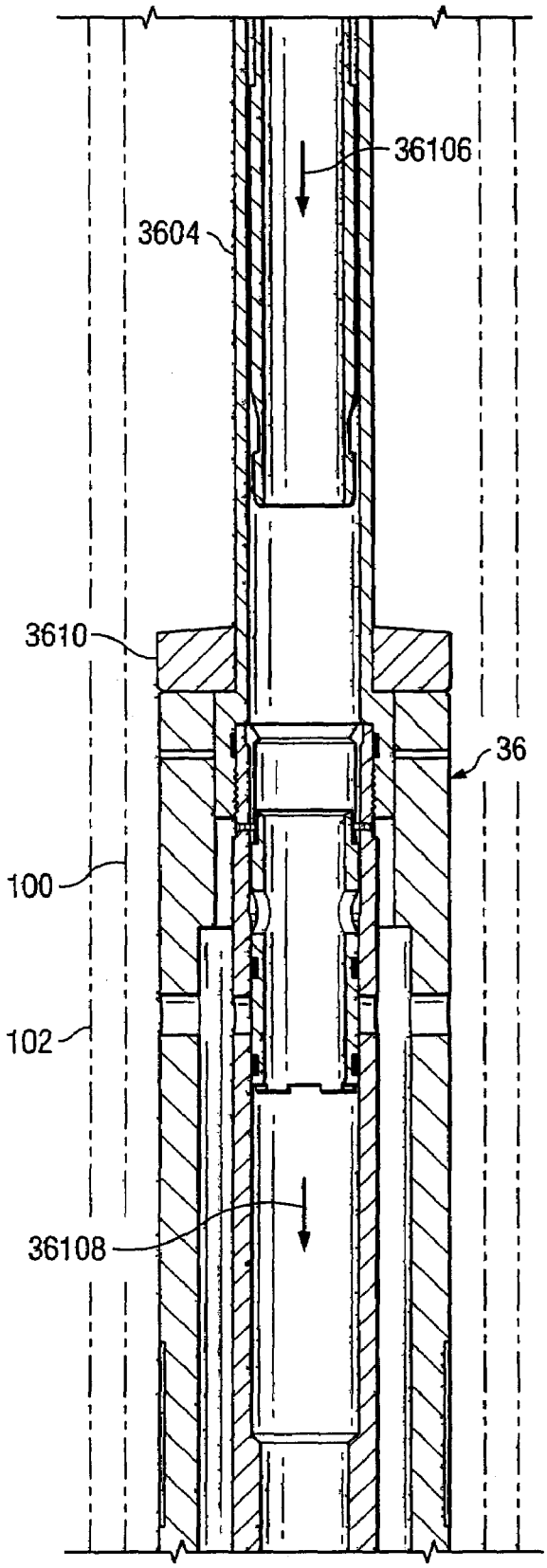
Figure 31E:
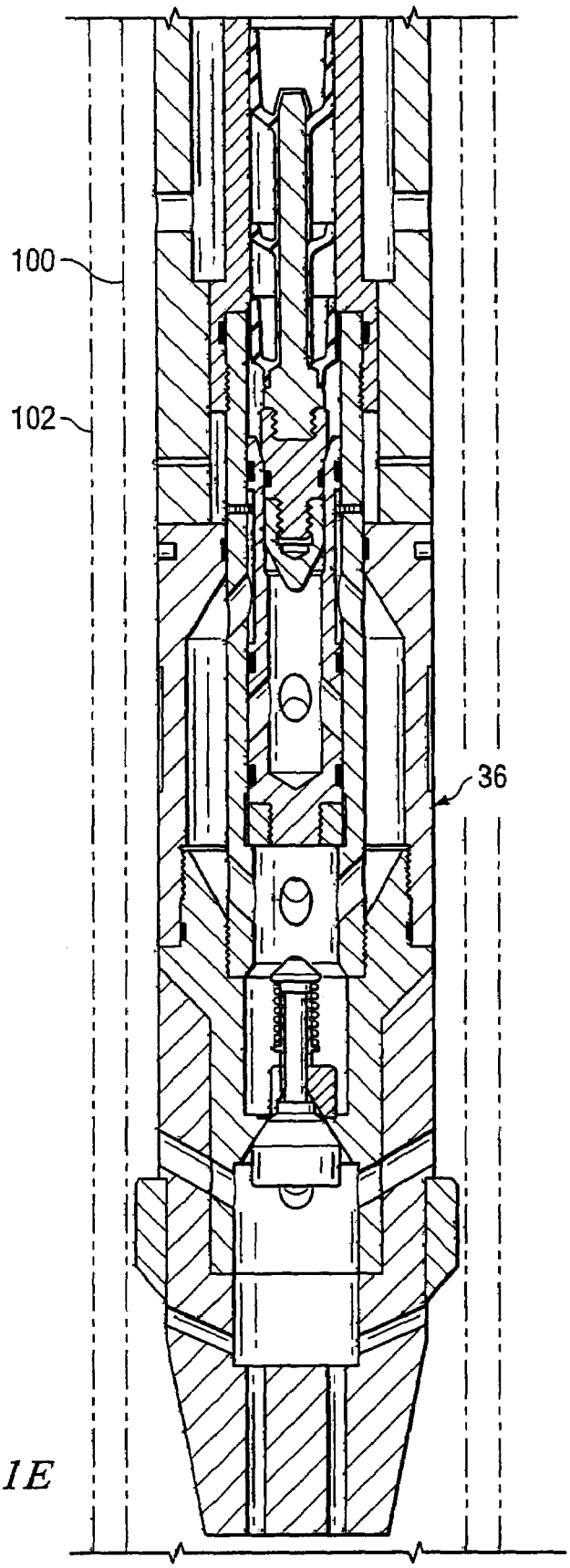
Figure 32A:
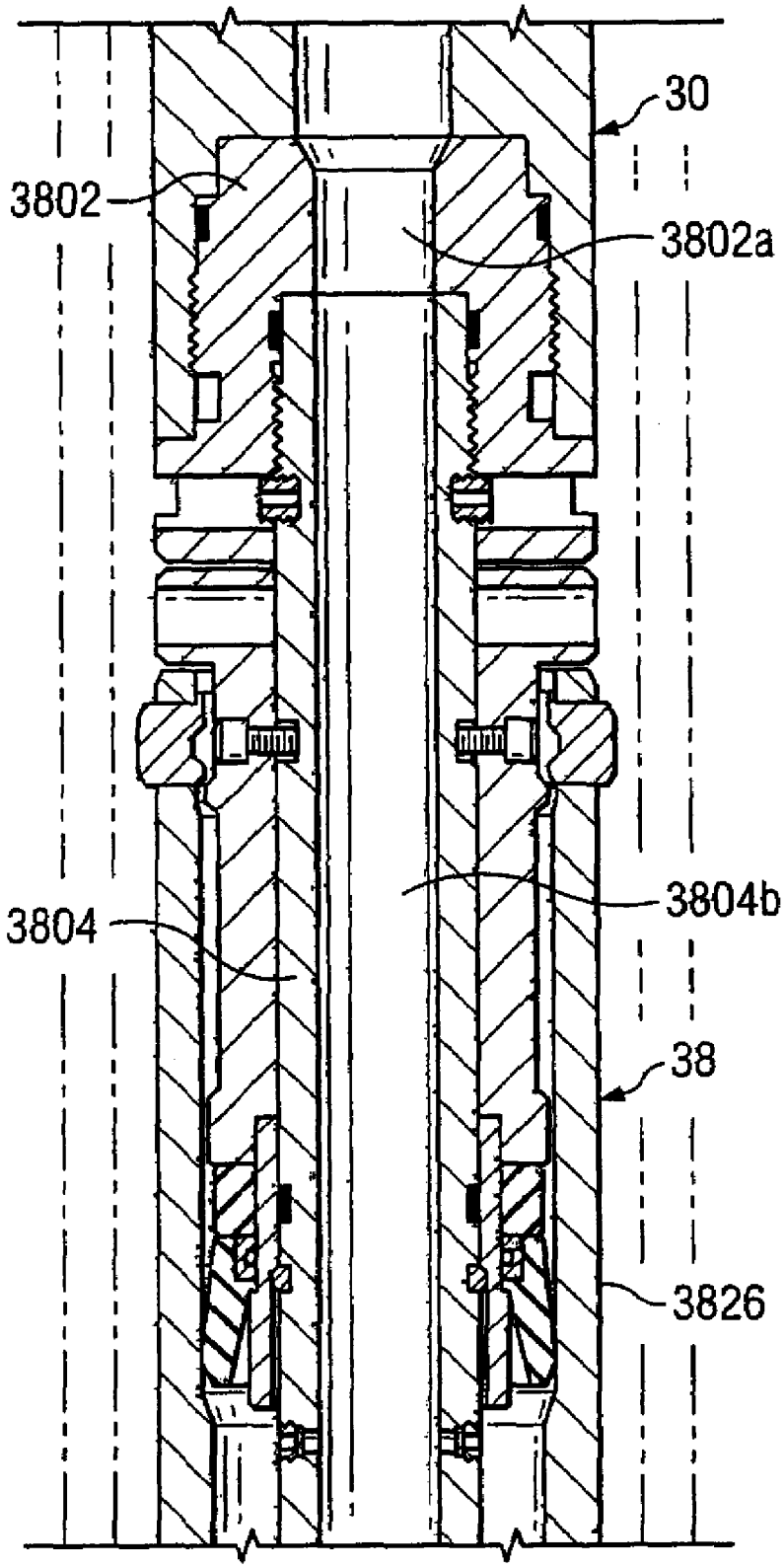
Figure 32B:
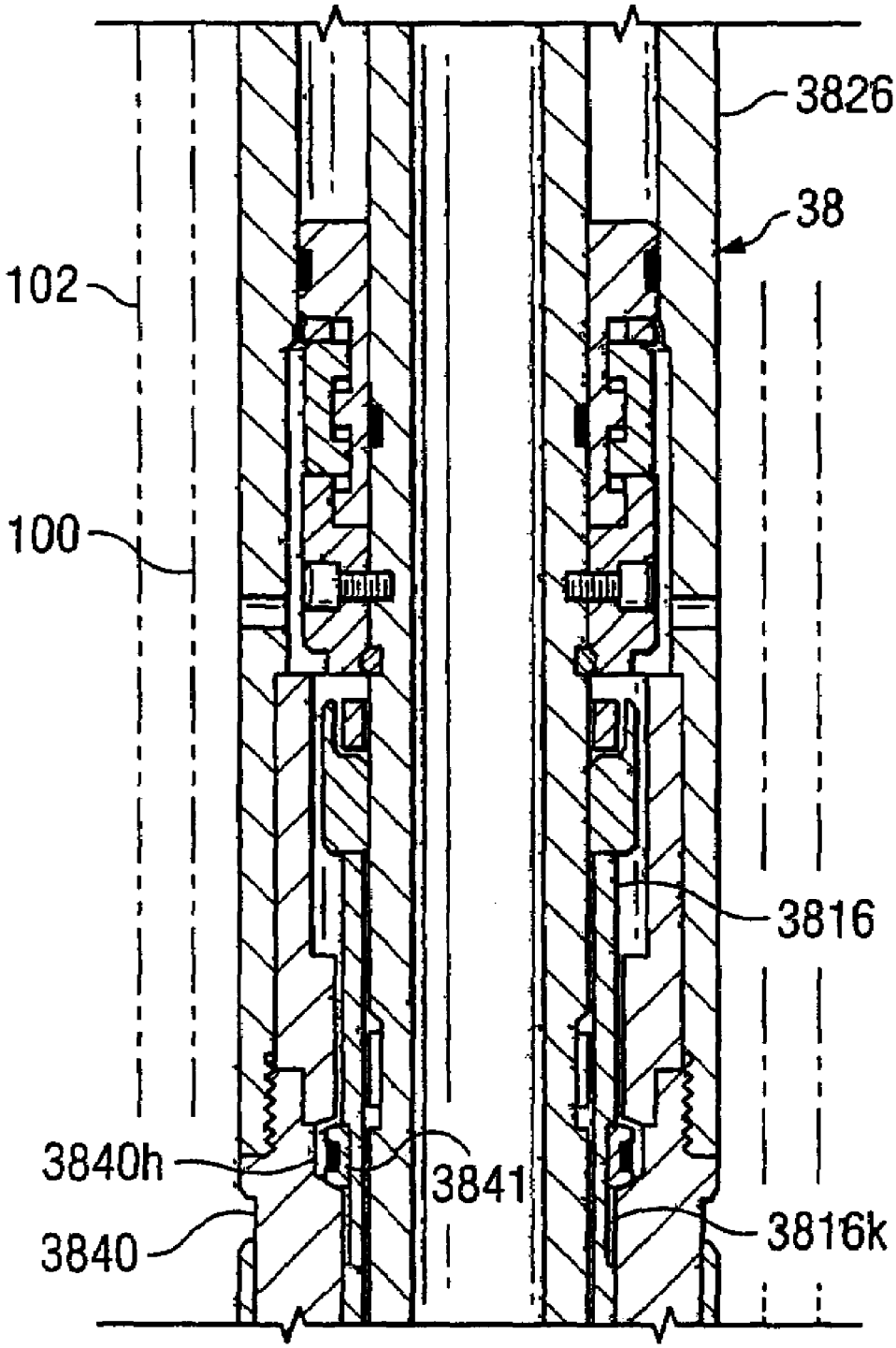
Figure 32C:
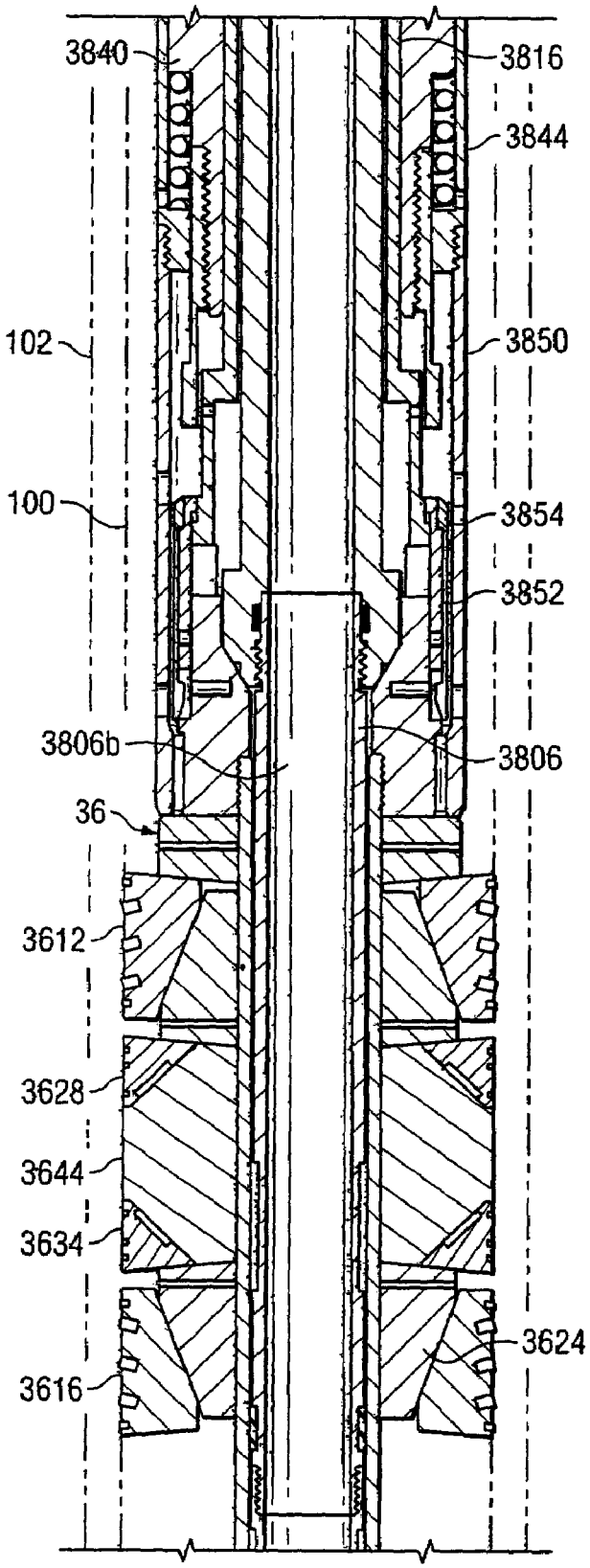
Figure 32D:
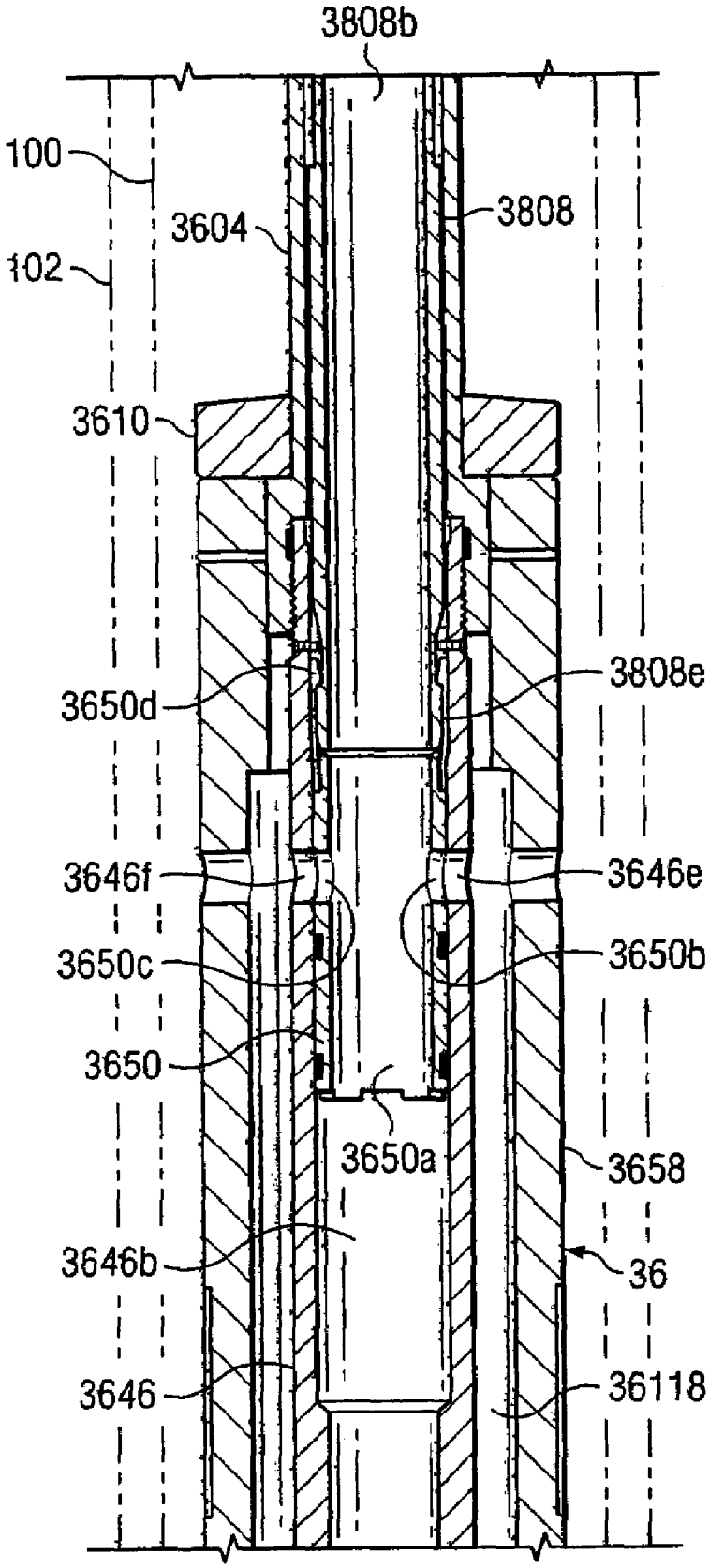
Figure 32E:
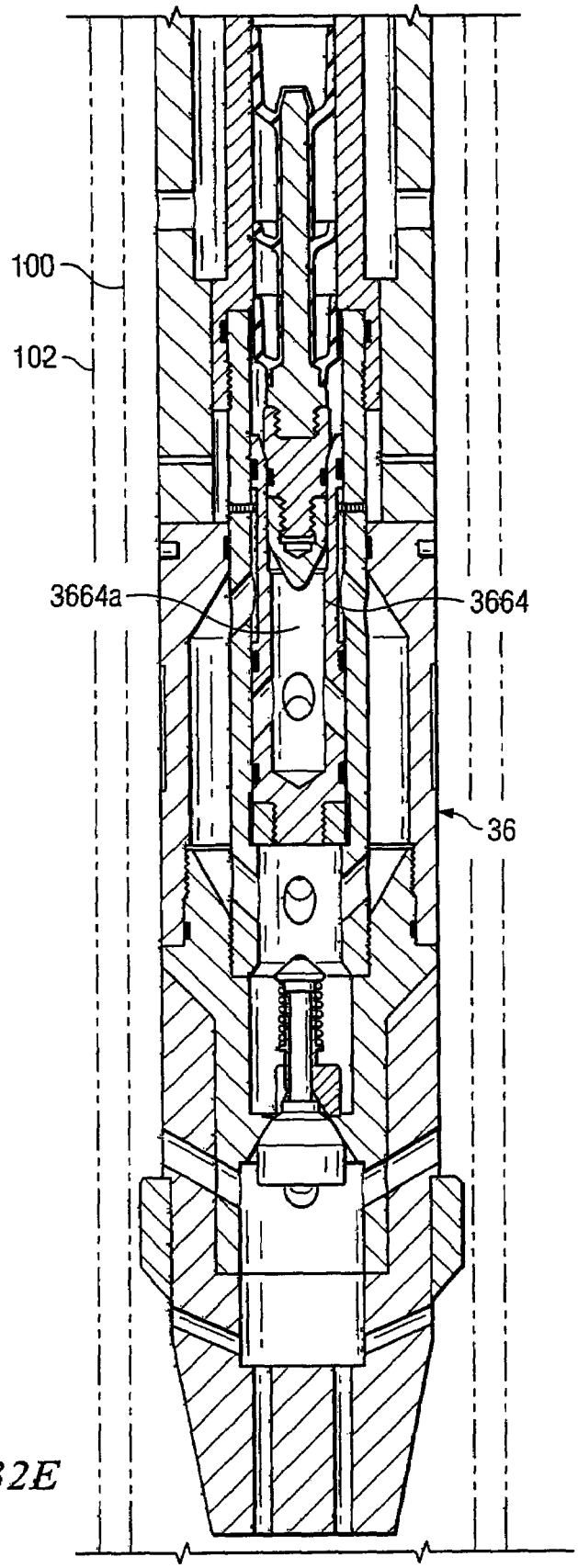
Figure 33A:
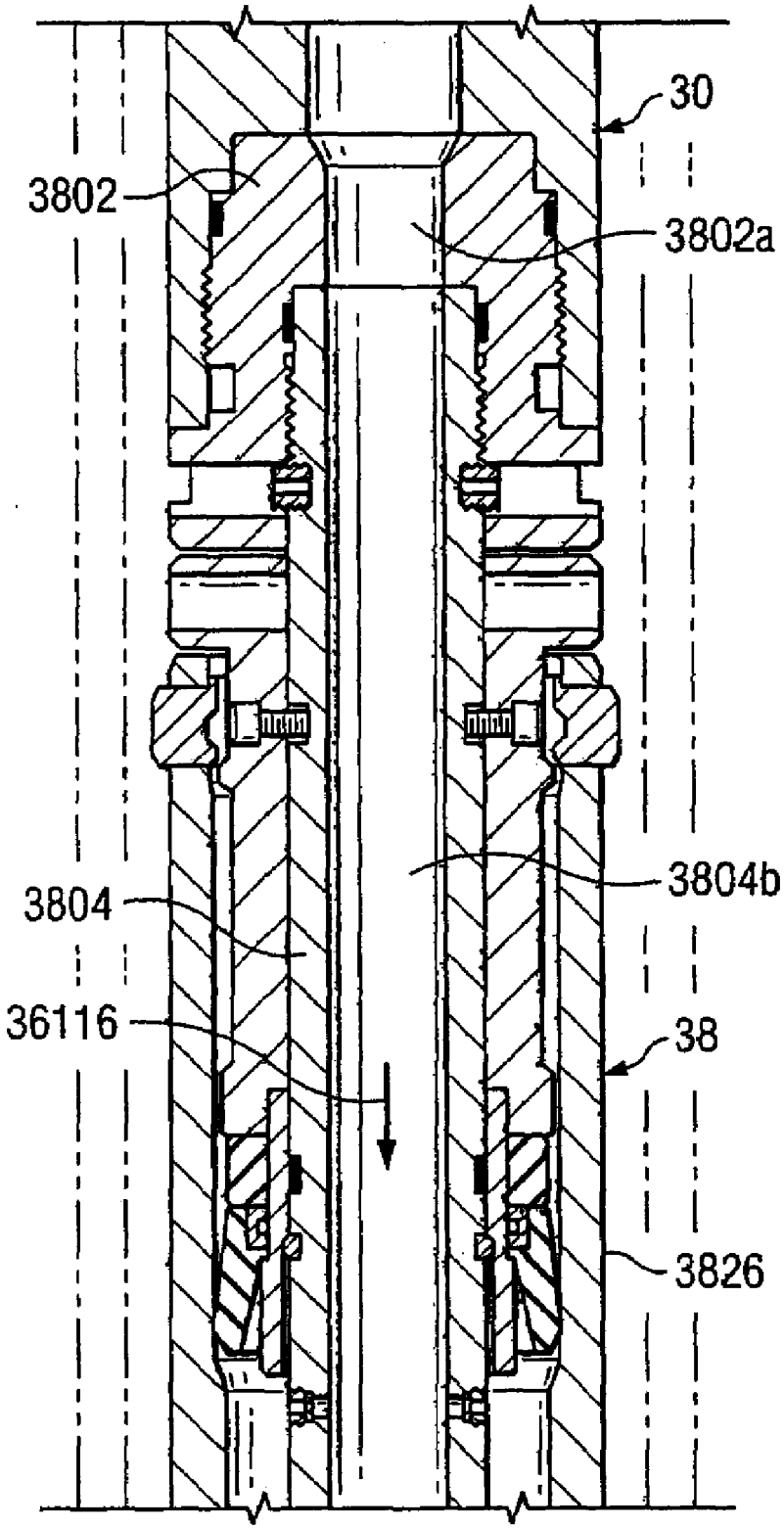
Figure 33B:
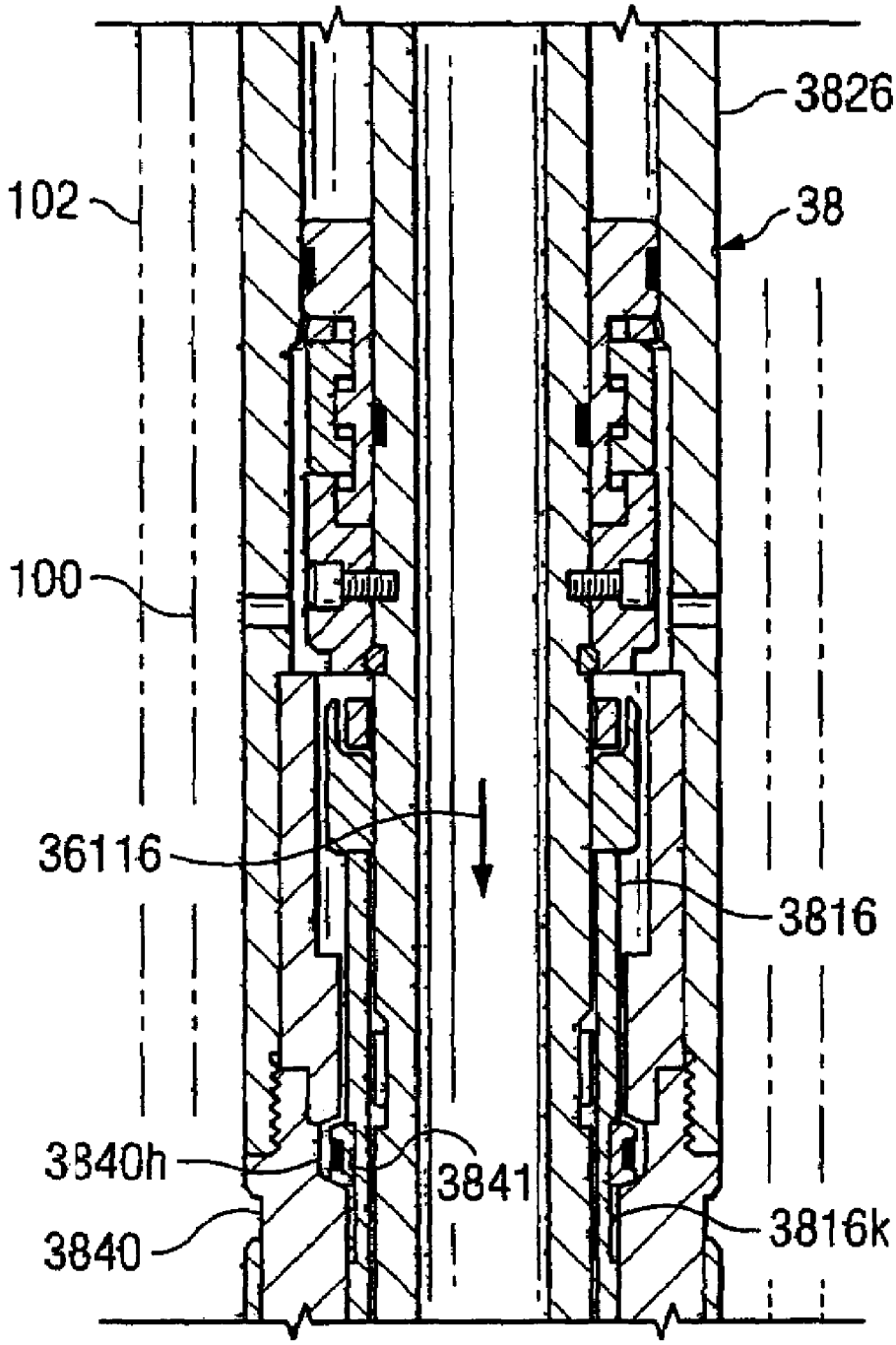
Figure 33C:
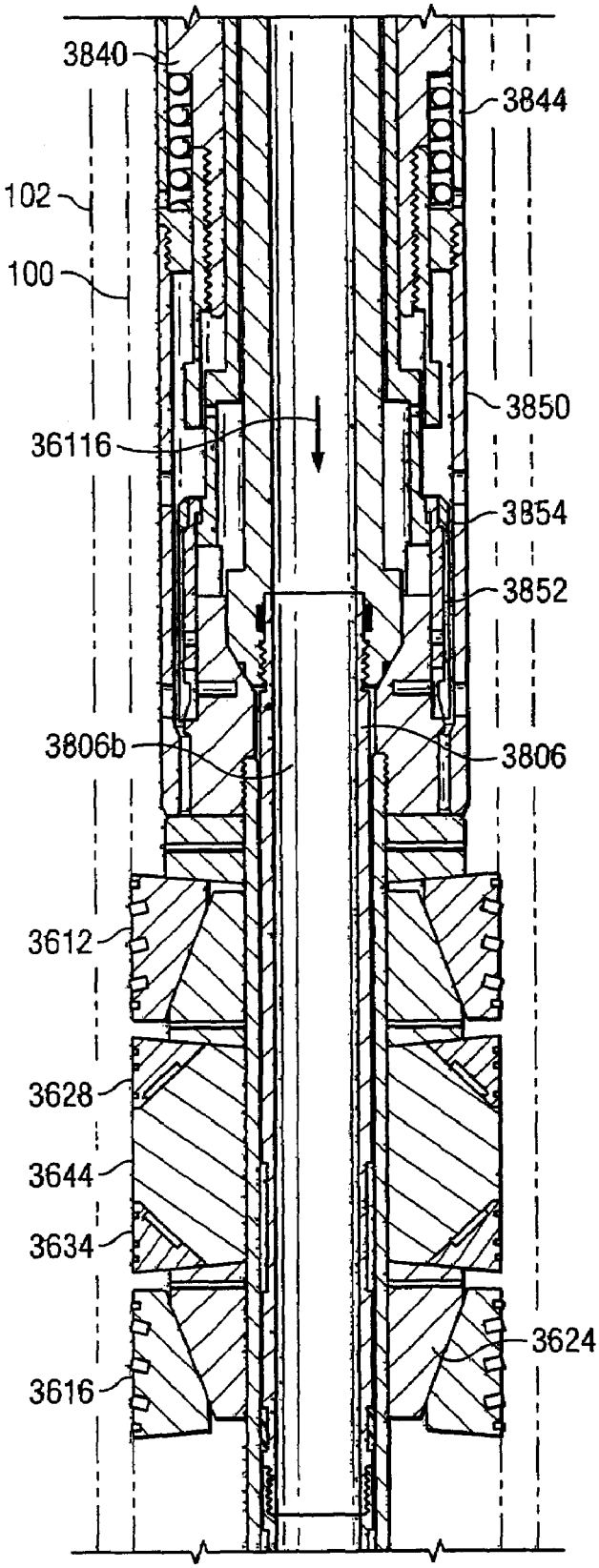
Figure 33D:
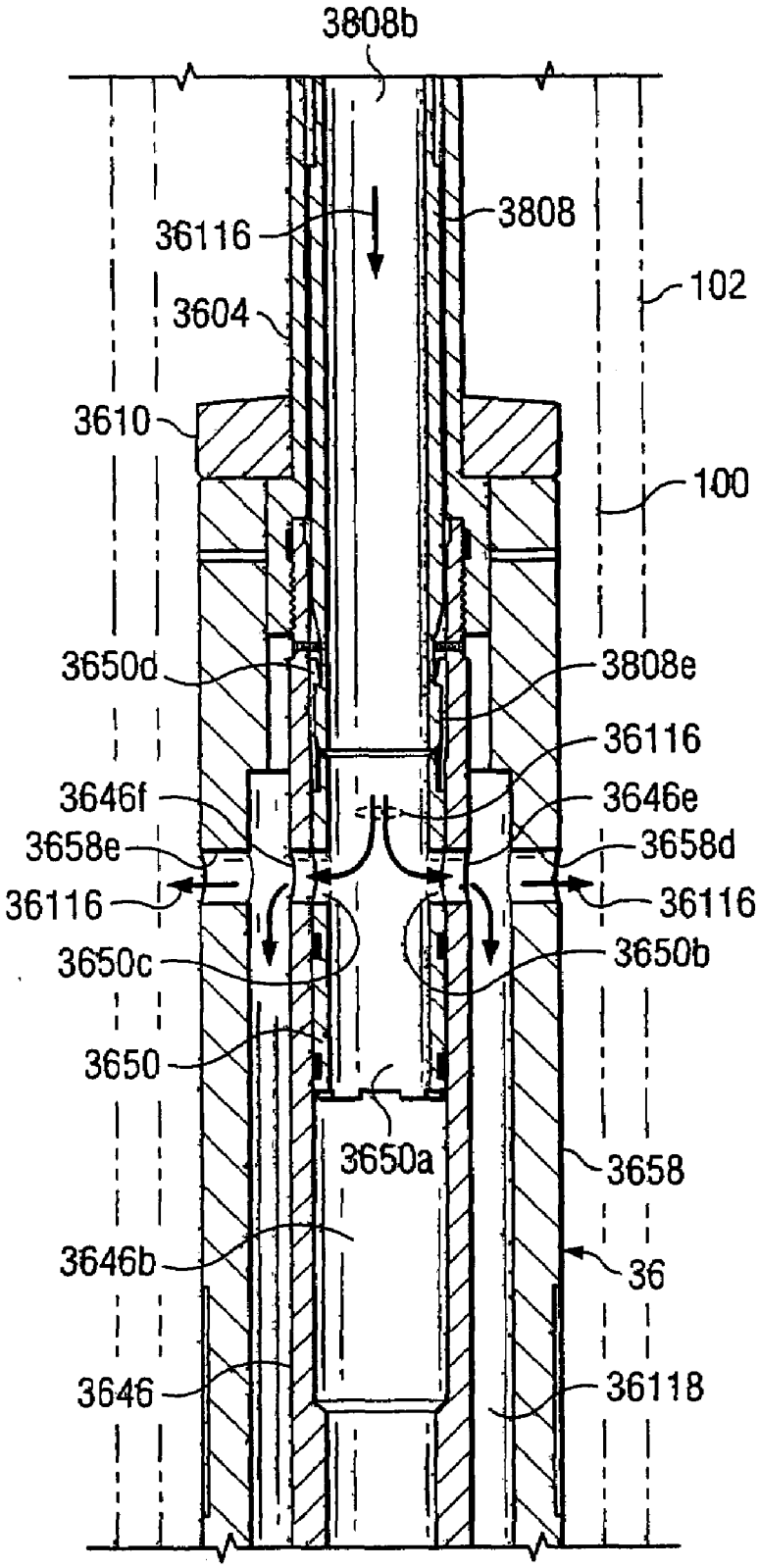
Figure 33E:
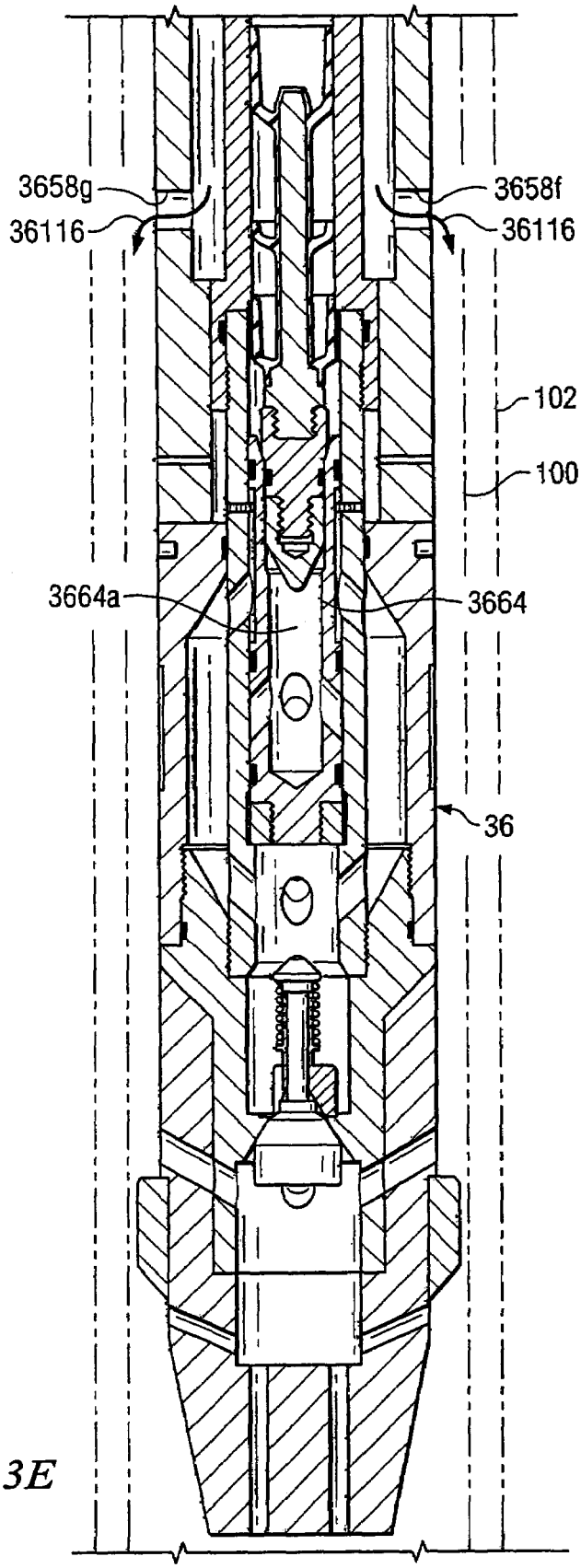

Upper retaining dogs, 3828*a* and 3828*b*, including internal annular recesses 3828*aa* and 3828*ba*, respectively, extend through the radial holes 3826*h* and 3826*i*, respectively, and are coupled to the tubular upper sleeve 3826. The upper retaining dogs, 3828*a* and 3828*b*, are adapted to further extend into the external annular recess 3818*e* to releasably engage the tubular spacer 3818, as shown in FIG. 22A and under conditions to be described.

A retaining ring 3829 extends into the external annular recess 3804*f* of the upper mandrel 3804 and extends into an internal annular recess 3830*a* of a lower dog retainer 3830. The lower dog retainer 3830 further includes an internal annular recess 3830*b*, an external annular recess 3830*c*, counterbores, 3830*d* and 3830*e*, that are axially aligned with the external mounting holes, 3804*o* and 3804*p*, respectively, of the upper mandrel 3804, and radial holes 3830*f* and 3830*g*. Screws, 3832*a* and 3832*b*, are threadably engaged with the counterbores, 3830*d* and 3830*e*, respectively, of the lower dog retainer 3830, and extend into the external mounting holes, 3804*o* and 3804*p*, respectively, of the upper mandrel 3804, which, along with the retaining ring 3829, couple the lower dog retainer 3830 to the upper mandrel 3804.

A tubular support or tubular retaining sleeve 3834 includes an external annular recess 3834*a* and an external annular recess 3834*b*, and mates with the exterior surface of the upper mandrel 3804 and with the interior surface of the upper sleeve 3826. Lower retaining dogs, 3836*a* and 3836*b*, including respective internal annular recesses, 3836*aa* and 3836*ab*, engage the internal annular recess 3826*d* and extend through the radial holes, 3830*f* and 3830*g*, respectively, to mate with the retaining sleeve 3834. It is understood that the retaining sleeve 3834 retains the lower retaining dogs, 3836*a* and 3836*b*, so that any relative movement between the lower retaining dogs, 3836*a* and 3836*b*, and the upper mandrel 3804 is substantially prevented. Rupture discs, 3838*a* and 3838*b*, are received and mounted within the radial passages, 3804*m* and 3804*n*.

An external threaded connection 3840*a* of an external annular recess 3840*b* of a tubular support or spring mandrel 3840 is received within the internal annular recess 3826*f* of the upper sleeve 3826 and is coupled to the internal threaded connection 3826*g* of the upper sleeve 3826. The spring mandrel 3840 further includes an external annular recess 3840*c*, an external annular recess 3840*d*, an external annular recess 3840*e*, an external threaded connection 3840*f*, an internal annular recess 3840*g* and an internal annular recess 3840*h*. A locking dog 3841 is received within the internal annular recess 3840*h* of the spring mandrel 3840 and engages the exterior surface of the bushing 3816.

An internal threaded connection 3842*a* of a tubular support or tubular spring retainer 3842 is coupled to the external threaded connection 3840*f* of the spring mandrel 3840, and includes a external flange 3842*b*. A tubular spring sleeve 3844 engages the external flange 3842*b* of the spring retainer 3842 and includes an internal annular recess 3844*a*, radial passages, 3844*b* and 3844*c*, an external annular recess 3844*d* and an external threaded connection 3844*e*. A compressible element such as a spring 3846 is retained and extends within an annular region 3848 defined by the internal annular recess 3844*a* of the spring sleeve 3844, the exterior of the spring retainer 3842 and at least an end of the spring mandrel 3840, thereby circumferentially extending about the tubular upper mandrel 3804.

A tubular locking dog retainer 3843 is received within the internal annular recess 3826*f* of the upper sleeve 3826 and includes an internal flange 3843*a* that engages the keys, 3812*a* and 3812*b*, and is received within the internal annular recess 3840*g* of the spring mandrel 3840.

An internal threaded connection 3850*a* of an end of a tubular setting sleeve 3850 that defines a longitudinal passage 3850*b*, radial passages, 3850*c* and 3850*d*, radial passages, 3850*e* and 3850*f*, and includes an internal flange 3850*g* at another end, engages the external threaded connection 3844*e* of the spring retainer 3842.

An internal flange 3852*a* of a tubular coupling ring 3852 that defines a longitudinal passage 3852*b* and radial passages, 3852*c* and 3852*d*, and includes an external annular recess 3852*e*, receives and mates with the external flange 3816*h* of the bushing 3816. An internal flange 3854*a* of a tubular retaining collet 3854 that includes a plurality of axially extending collet fingers 3854*b*, each finger 3854*b* having internal flanges 3854*c* at an end of each collet finger, receives the tubular coupling ring 3852 and engages the external annular recess 3852*e* of the tubular coupling ring 3852.

In an exemplary embodiment, as illustrated in FIGS. 23A to 23E, during the operation of the packer setting tool assembly 38 and the packer assembly 36, the packer setting tool assembly 38 and the packer assembly 36 are coupled to one another by inserting the end of the tubular upper adaptor 3602 into the other end of the tubular coupling ring 3852, bringing the circumferentially spaced teeth 3816*f* of the other end of the tubular bushing 3816 into engagement with the circumferentially spaced teeth 3602*e* of the end of the tubular upper adaptor 3602, and mounting shear pins, 36100*a* and 36100*b*, within the radial passages, 3852*c* and 3852*d*, respectively, of the tubular coupling ring 3852 and within the mounting holes, 3602*c* and 3602*d*, respectively, of the tubular upper adaptor 3602. As a result, the tubular mandrel 3806 and the tubular stinger 3808 of the packer setting tool assembly 38 are thereby positioned within the longitudinal passage 3604*b* of the tubular upper mandrel 3604 with the engagement shoulder 3808*e* of the tubular stinger 3808 positioned within the longitudinal passage 3646*b* of the tubular lower mandrel 3646 proximate the collet fingers 3650*d* of the tubular sliding sleeve valve 3650.

In an exemplary embodiment, the packer setting tool assembly 38 and the packer assembly 36 are positioned within the expandable wellbore casing 100, and the internal threaded connection 30*a* of an end of the adjustable casing expansion cone assembly 30 receives and is coupled to the external threaded connection 3802*f* of the tubular adaptor 3802 of the packer setting tool assembly 38. The upper retaining dogs, 3828*a* and 3828*b*, and/or the outer diameter of the tubular upper sleeve 3826, are sized so that the upper retaining dogs, 3828*a* and 3828*b*, and/or at least a portion of the exterior surface of the tubular upper sleeve 3826, engage the wellbore casing 100, and the tubular upper sleeve 3826 is radially inwardly biased so that the upper retaining dogs, 3828*a* and 3828*b*, extend into the external annular recess 3818*e* and are forced to mate with the tubular spacer 3818, thereby releasably engaging the tubular spacer 3818, including releasably engaging the annular protrusion 3818*j*. Furthermore, in an exemplary embodiment, torque pins, 3676*d* and 3676*e*, may be mounted within mounting holes, 3676*f* and 3676*g*, respectively, of the tubular bypass sleeve 3676 to couple the tubular bypass sleeve 3676 to the expandable wellbore casing 100. As a result, torsion loads may be transferred between the tubular bypass sleeve 3676 and the expandable wellbore casing 100.

In an exemplary embodiment, as illustrated in FIGS. 24A to 24E, the plug 36104 is then injected into the setting tool assembly 38 and the packer assembly 36 by injecting the fluidic material 36106 into the setting tool assembly 38 and the packer assembly 36 through the longitudinal passages, 3802*a*, 3804*b*, 3806*b*, 3808*b*, 3650*a*, 3646*b* and 3664*a* of the tubular adaptor 3802, tubular upper mandrel 3804, tubular mandrel 3806, tubular stinger 3808, tubular sliding sleeve valve 3650, tubular lower mandrel 3646, and tubular plug seat 3664, respectively. The plug 36104 is thereby positioned within the longitudinal passage 3664*a* of the tubular plug seat 3664. The flow ports, 3664*c* and 3664*d*, of the tubular plug seat 3664 are aligned with the upper flow ports, 3660*c* and 3660*d*, respectively, of the tubular bypass mandrel 3660.

In an exemplary embodiment, as illustrated in FIGS. 25A to 25E, continued injection of the fluidic material 36106 following the seating of the plug 36104 within the longitudinal passage 3664*a* of the tubular plug seat 3664 causes the plug and the tubular plug seat to be displaced downwardly in the direction 36108 until further movement of the tubular plug seat is prevented by the interaction of the circumferentially-spaced set screws 3674 and 3675 with the external annular recess 3664*f* of the tubular plug seat. As a result, the flow ports, 3664*c* and 3664*d*, of the tubular plug seat 3664 are moved out of alignment with the upper flow ports, 3660*c* and 3660*d*, respectively, of the tubular bypass mandrel 3660.

In an exemplary embodiment, as illustrated in FIGS. 26A to 26E, continued injection of the fluidic material 36106 following the prevention of further movement of the tubular plug seat 3664 actuates the extension actuator assembly 26 in a manner substantially similar to that described above so that the extension actuator assembly 26 pushes the adjustable bell section expansion cone assembly 28, the adjustable casing expansion cone assembly 30, the packer setting tool assembly 38 and the packer assembly 36 out of the wellbore casing 100.

Since the packer setting tool assembly 38 extends outside of the wellbore casing 100, the upper retaining dogs, 3828*a* and 3828*b*, and the tubular upper sleeve 3826 no longer engage the wellbore casing 100 and thus the tubular upper sleeve 3826 is no longer radially inwardly biased. As a result, the upper retaining dogs, 3828*a* and 3828*b*, are released from mating with the tubular spacer 3818 and engaging the annular protrusion 3818*j*.

In an exemplary embodiment, it is understood that if it is desired to cease further operation of the packer assembly 36 when the packer setting tool assembly 38 and the packer assembly 36 extend outside of the wellbore casing 100, the upper sleeve 3826 is displaced in a direction toward the packer assembly 36 in a manner to be described below, thereby causing the spring sleeve 3844, the setting sleeve 3850 and the upper tubular spacing ring 3606 of the packer assembly 36 to move in a direction towards the upper tubular wedge 3620 in a manner described below. As a result, the upper tubular slip 3612 is forced to move along the upper tubular wedge 3620 until the upper tubular slip 3612 is pushed off of the packer assembly 36, thereby permitting the packer setting tool assembly 38 and the packer assembly 36 to be retrieved.

In an exemplary embodiment, it is understood that if the packer setting tool assembly 38 and the packer assembly 36 are not able to be extended outside of the wellbore casing 100, the upper retaining dogs, 3828*a* and 3828*b*, continue to mate with the tubular spacer 3818 and to engage the annular protrusion 3818*j*, thereby preventing the upper sleeve 3826 from moving in a direction towards the packer assembly 36 in a manner, and for reasons, to be described below, and permitting the packer setting tool assembly 38 and the packer assembly 36 to be retrieved.

In an exemplary embodiment, the wellbore casing 100 is radially expanded and plastically deformed using the ball gripper assembly 16, the tension actuator assembly 18, the casing lock assembly 24, the extension actuator assembly 26 and the expansion cone assemblies, 28 and 30, in a manner of operation substantially similar to any one of the manners of operation described and/or referenced above, and/or any combination thereof.

In an exemplary embodiment, as illustrated in FIGS. 27A to 27E, after the expandable wellbore casing 100 has been radially expanded and plastically deformed to form at least the bell section 112 of the expandable wellbore casing 100, thereby shearing the torque pins, 3676*d* and 3676*e*, the packer setting tool assembly 38 and the packer assembly 36 are then moved upwardly to a position within the expandable wellbore casing 100 above the bell section 112.

Continued injection of the fluidic material 36106, with any further movement of the tubular plug seat 3664 still being prevented, increases the operating pressure of the fluidic material 36106 above a predetermined level sufficient to rupture the rupture discs, 3838*a* and 3838*b*. As a result, the fluidic material 36106 enters an annulus 3856 defined by the tubular upper mandrel 3804 and the tubular upper sleeve 3826. As a result, the retaining sleeve 3834 is displaced downwardly in the direction 36108, and engages the internal annular recess 3830*b* of the lower dog retainer 3830. As a result, the lower retaining dogs, 3836*a* and 386*b*, no longer engage the internal annular recess 3826*d* of the upper sleeve 3826, but instead move radially inward to engage the external annular recesses, 3834*a* and 3834*b*, of the tubular retaining sleeve 3834. Thus, it is understood that the lower retaining dogs, 3836*a* and 3836*b*, are released from the upper sleeve 3826.

In an exemplary embodiment, as illustrated in FIGS. 28A to 28E, the operating pressure of the fluidic material 36106 in the annulus 3856 causes the upper sleeve 3826, the spring mandrel 3840, the spring sleeve 3844 and the setting sleeve 3850 to be displaced in the downward direction 36108 until the setting sleeve 3850 engages the upper tubular spacer ring 3606 of the packer assembly 36, which is mated with the upper tubular slip 3612 of the packer assembly 36.

The operating pressure of the fluidic material 36106 in the annulus 3856 continues to cause the upper sleeve 3826, the spring mandrel 3840 and the spring sleeve 3844 to be displaced in the downward direction 36108, relative to the setting sleeve 3850. As a result, the external annular recess 3840*d* of the spring mandrel 3840 compresses the spring 3846 against an end face 3844*aa* defined by the internal annular recess 3844*a* of the spring sleeve 3844.

When the spring 3846 is fully compressed, the operating pressure of the fluidic material 36106 in the annulus 3856 causes the upper sleeve 3826 to force the upper tubular slip 3612 of the packer assembly 36, via force transmission across the spring mandrel 3840, the compressed spring 3846, the spring sleeve 3844, the setting sleeve 3850 and the upper tubular spacer ring 3606, to move along the upper tubular wedge 3620 of the packer assembly 36. In an exemplary embodiment, it is understood that the shear pins, 3608*a* and 3608*b*, may be broken to enable the upper tubular slip 3612 to move along the upper tubular wedge 3620. In an exemplary embodiment, it is further understood that one or more of the slip retaining bands, 3612*c*, 3612*d*, 3612*e*, 3612*f*, 3612*g*, 3614*a*, 3614*b*, 3614*c*, 3614*d*, and 3614*e*, if present, may be broken to enable the upper tubular slip 3612 to move along the upper tubular wedge 3620.

The upper sleeve 3826 continues to force the upper tubular slip 3612 to move along the upper tubular wedge 3620 until the spring mandrel 3840 engages the external flange 3816*d* of the tubular bushing 3816, the end of which, in turn, is engaged with the external flange 3804*h* of the upper mandrel 3804. Thus, any further displacement of the upper sleeve 3826 in the downward direction 36108 is substantially prevented.

As a result of the displacement of the upper sleeve 3826 in the downward direction 36108, the keys, 3812*a* and 3812*b*, are released from their engagement with the internal flange 3843*a* of the locking dog retainer 3843. As another result of the displacement of the upper sleeve 3826 in the downward direction 36108, the locking dog 3841 is displaced in the downward direction 36018 so that the locking dog 3841 is received within the external annular recess 3816*k* of the bushing 3816.

In an exemplary embodiment, it is understood that the keys, 3812*a* and 3812*b*, lock the bushing 3816 to the upper mandrel 3804, and allow torque and load top to be transmitted from the upper mandrel 3804 to the tubular bushing 3816, and to the packer assembly 36 via the above-described coupling between the packer setting tool assembly 38 and the packer assembly 36. In an exemplary embodiment, it is understood that the keys, 3812*a* and 3812*b*, prevent the stinger 3808 from engaging and displacing the sliding sleeve valve 3650, thereby preventing the radial flow ports, 3650*b* and 3650*c*, of the sliding sleeve valve 3650 from being axially aligned with the flow ports, 3646*e* and 3646*f*, of the tubular lower mandrel 3646 of the packer assembly 36.

In an exemplary embodiment, as illustrated in FIGS. 29A through 29E, although any further displacement of the upper sleeve 3826 in the downward direction 36108 is prevented, the fully compressed spring 3846 begins to uncompress, and extends to force the spring sleeve 3844, the setting sleeve 3850 and the upper tubular spacing ring 3606 of the packer assembly 36 in the downward direction 36108, thereby causing the upper tubular slip 3612 to further move along the upper tubular wedge 3620 and against the interior surface of the wellbore casing 100, until the upper tubular slip 3612 is set against the wellbore casing 100. As a result, further longitudinal displacement of the upper tubular slip 3612 relative to the wellbore casing 100 is prevented.

In an exemplary embodiment, it is understood that, by preventing any further displacement of the upper sleeve 3826 in the downward direction and by permitting the compressed spring 3846 to uncompress and force the upper tubular slip 3612 to set against the wellbore casing 100, the upper tubular slip 3612 is substantially prevented from applying an impact load against the interior surface of the wellbore casing 100.

In an exemplary embodiment, as illustrated in FIGS. 30A through 30E, after the upper tubular slip 3612 is set against the wellbore casing 100, an upward tensile force is applied to the tubular support member 12, and the ball gripper assembly 16 is then operated to engage the interior surface of the wellbore casing 100 in a manner of operation substantially similar to any one of the manners of operation described and/or referenced above, and/or any combination thereof. The tension actuator assembly 18 is then operated to apply a tensile force to the tubular adaptor 3802 in an upward direction 3860, in any one of the manners of operation described and/or referenced above, and/or any combination thereof, thereby compressing the lower tubular slip 3616, the lower tubular wedge 3624, the lower tubular extrusion limiter 3634, the central elastomeric packer element 3644, the upper tubular extrusion limiter 3628 and the upper tubular wedge 3620 between the lower tubular spacer ring 3610 and the stationary upper tubular slip 3612. As a result, the lower tubular slip 3616 moves along the lower tubular wedge 3624 and into engagement with the interior surface of the wellbore casing 100, forcing the lower tubular slip 3616 to set against the interior surface of the wellbore casing 100. As another result, the elastomeric packer element 3644 is compressed radially outwardly into engagement with the interior surface of the wellbore casing 100, forcing the packer element 3644 to set against the interior surface of the wellbore casing 100. As a result, further longitudinal displacement of the upper tubular slip 3612, the lower tubular slip 3616 and the packer element 3644, relative to the wellbore casing 100, is prevented.

Continued application of the upward tensile force to the tubular adaptor 3802 will then shear the shear pins, 36100*a* and 36100*b*, thereby disengaging and releasing the packer setting tool assembly 38 from the packer assembly 36.

In an exemplary embodiment, the packer setting tool assembly 38 continues to move away from the packer assembly 36, in the direction 3860, at least until at least a portion of the stinger 3808 no longer extends within the longitudinal passage 3602*a* of the tubular upper adaptor 3602 of the packer assembly 36, and the adjustable expansion cone assembly 30 engages and mates with at least a portion of the interior surface of the unexpanded portion of the wellbore casing 100.

In an exemplary embodiment, as illustrated in FIGS. 31A through 31E, continued injection of the fluidic material 36106 causes the packer setting tool assembly 38 to move in the direction 36108 until the tubular spacer ring 3606 engages the stationary upper tubular slip 3612. The continued injection of the fluidic material 36106 also causes the packer assembly 36, including the tubular upper mandrel 3604, to move in the direction 36108 so that the lower tubular spacer ring 3610 moves away from the stationary lower tubular slip 3616. As a result of the continued injection of the fluidic material 36106, the portion of the interior of the wellbore casing 100 within which at least a portion of the packer assembly 36 extends is pressurized, thereby testing the ability of the engagement between the wellbore casing 100 and one or more of the upper tubular slip 3612, the upper tubular extrusion limiter 3628, the elastomeric packer element 3644, the lower tubular extrusion limiter 3634 and the lower tubular slip 3616 to maintain a pressure seal against the interior surface of the wellbore casing 100.

In an exemplary embodiment, as illustrated in FIGS. 32A through 32E, the continued injection of the fluidic material 36106 is stopped, and the operating pressure within the longitudinal passages, 3802*a*, 3804*b*, 3806*b*, 3808*b*, 3650*a*, 3646*b* and 3664*a* of the tubular adaptor 3802, tubular upper mandrel 3804, tubular mandrel 3806, tubular stinger 3808, tubular sliding sleeve valve 3650, tubular lower mandrel 3646, and tubular plug seat 3664, respectively, is released. The packer setting tool assembly 38 is brought back into engagement with the packer assembly 36 until the engagement shoulder 3808*e* of the other end of the tubular stinger 3808 engages the collet fingers 3650*d* of the end of the tubular sliding sleeve valve 3650. As a result, further downward displacement of the tubular stinger 3808 displaces the tubular sliding sleeve valve 3650 downwardly until the radial flow ports, 3650*b* and 3650*c*, of the tubular sliding sleeve valve 3650 are aligned with the radial flow ports, 3646*e* and 3646*f*, of the tubular lower mandrel 3646. During the downward displacement of the tubular stinger 3808, the locking dog 3841 engages the external annular recess 3816*k* of the bushing 3816 and the internal annular recess 3840*h* of the spring mandrel 3840 to further separate the bushing 3816, the coupling ring 3852 and the retaining collet 3854 from the packer assembly 36.

In an exemplary embodiment, as illustrated in FIGS. 33A through 33E, a hardenable fluidic sealing material 36116 may then be injected into the packer setting tool assembly 38 and the packer assembly 36 through the longitudinal passages 3802*a*, 3804*b*, 3806*b*, 3808*b* and 3650*a* of the tubular adaptor 3802, tubular upper mandrel 3804, tubular mandrel 3806, tubular stinger 3808 and the tubular sliding sleeve valve 3650, respectively. The hardenable fluidic sealing material 3116 may then flow out of the longitudinal passage 3650*a*, through the radial ports, 3650*b* and 3650*c*, of the tubular sliding sleeve valve 3650, through the radial ports, 3646*e* and 3646*f*, of the tubular lower mandrel 3646, and into an annulus 36118 defined by the exterior surface of the tubular lower mandrel 3646 and the interior surface of the tubular outer sleeve 3658. The hardenable sealing material 3116 may then flow out of the annulus 36118, through the upper flow ports, 3658*d* and 3658*e*, and the lower flow ports, 3658*f* and 3658*g*, and into the annulus between the wellbore casing 100 and the wellbore 102. In an exemplary embodiment, in addition to, or instead of the injection of the hardenable fluidic sealing material 36116, it is understood that other well fluids may be injected into the packer setting tool assembly 38 and the packer assembly 36 in a manner similar to the injection of the hardenable fluidic sealing material 36116.

The tubular sliding sleeve valve 3650 may then be returned to its original position, with the radial flow ports, 3650*b* and 3650*c*, of the tubular sliding sleeve valve out of alignment with the flow ports, 3646*e* and 3646*f*, of the tubular lower mandrel 3646. The hardenable fluidic sealing material 36116 may then be allowed to cure before, during, or after the continued operation of the system 10 to further radially expand and plastically deform the expandable wellbore casing 100.

In an exemplary embodiment, it is understood that if it is desired to retrieve the packer setting tool assembly 38 when the packer assembly 36 is in the bell section 112 of the wellbore casing 100, the packer setting tool assembly 38 and the packer assembly 36 are operated in the above-described manner so that the upper tubular slip 3612, the lower tubular slip 3616 and the packer element 3644 engage and set against the interior surface of the bell section 112 of the wellbore casing 100, thereby permitting the packer setting tool assembly 38 to be retrieved, that is, to be moved in a direction away from the upper tubular slip 3612, the lower tubular slip 3614 and the packer element 3644.

Figure 34:
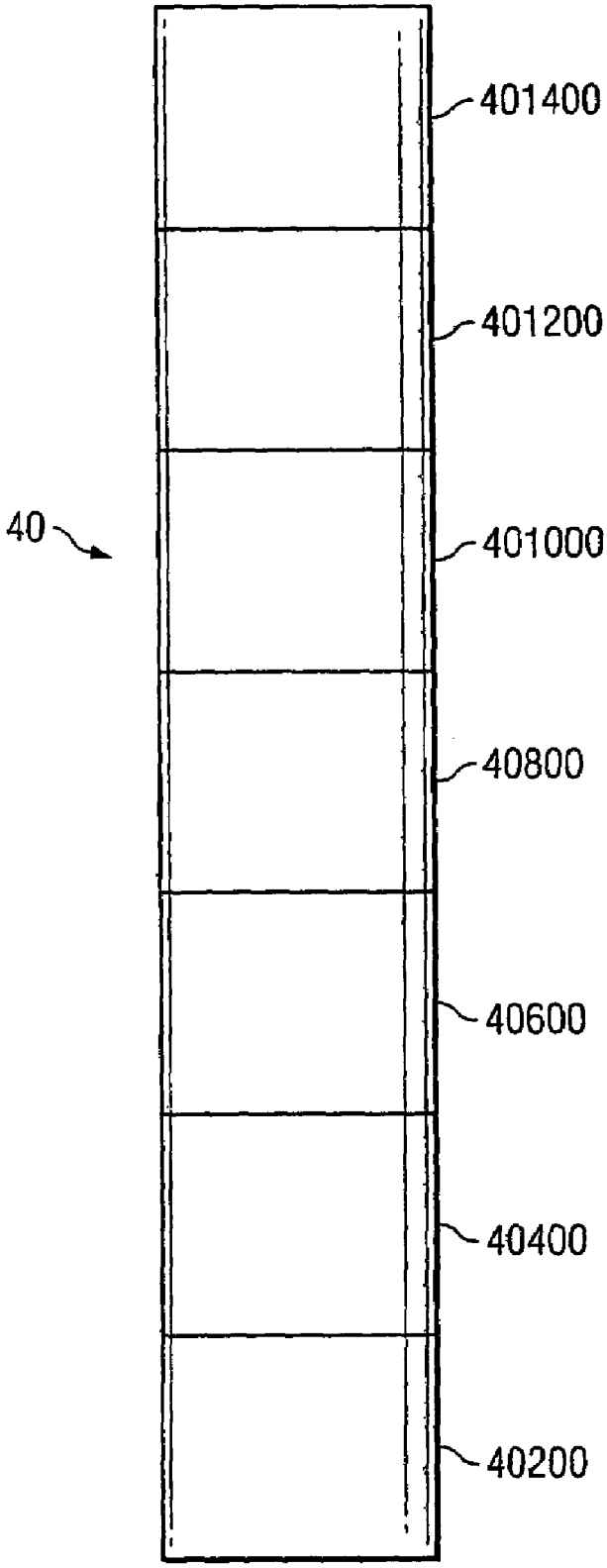
FIG. 34 is an elevational view of another exemplary embodiment of a tension actuator assembly.

In an exemplary embodiment, as illustrated in FIG. 34, a tension actuator assembly 40 includes a lower subassembly 40200 having an end that is coupled to an end of a middle subassembly 40400. A middle subassembly 40600 is coupled to the other end of the middle subassembly 40400 and includes an end that is coupled to a middle subassembly 40800. A middle subassembly 401000 is coupled to the other end of the middle subassembly 40800 and includes an end that is coupled to an upper subassembly 401200. A top subassembly 401400 is coupled to the other end of the upper subassembly 401200.

Figure 35A:
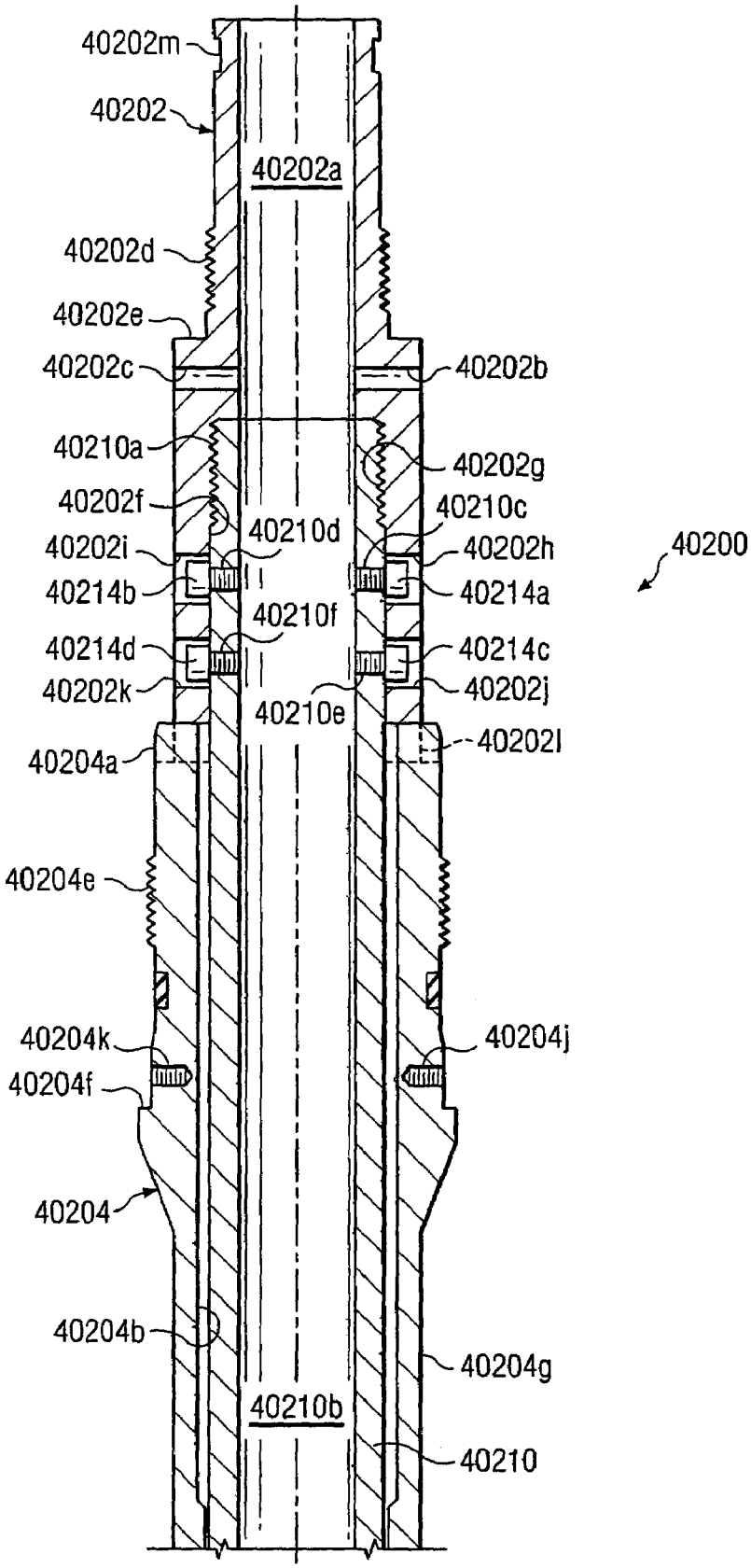
FIGS. 35A to 35C is a fragmentary cross-sectional illustration of an exemplary embodiment of a lower subassembly of the tension actuator assembly of FIG. 34.
Figure 35B:
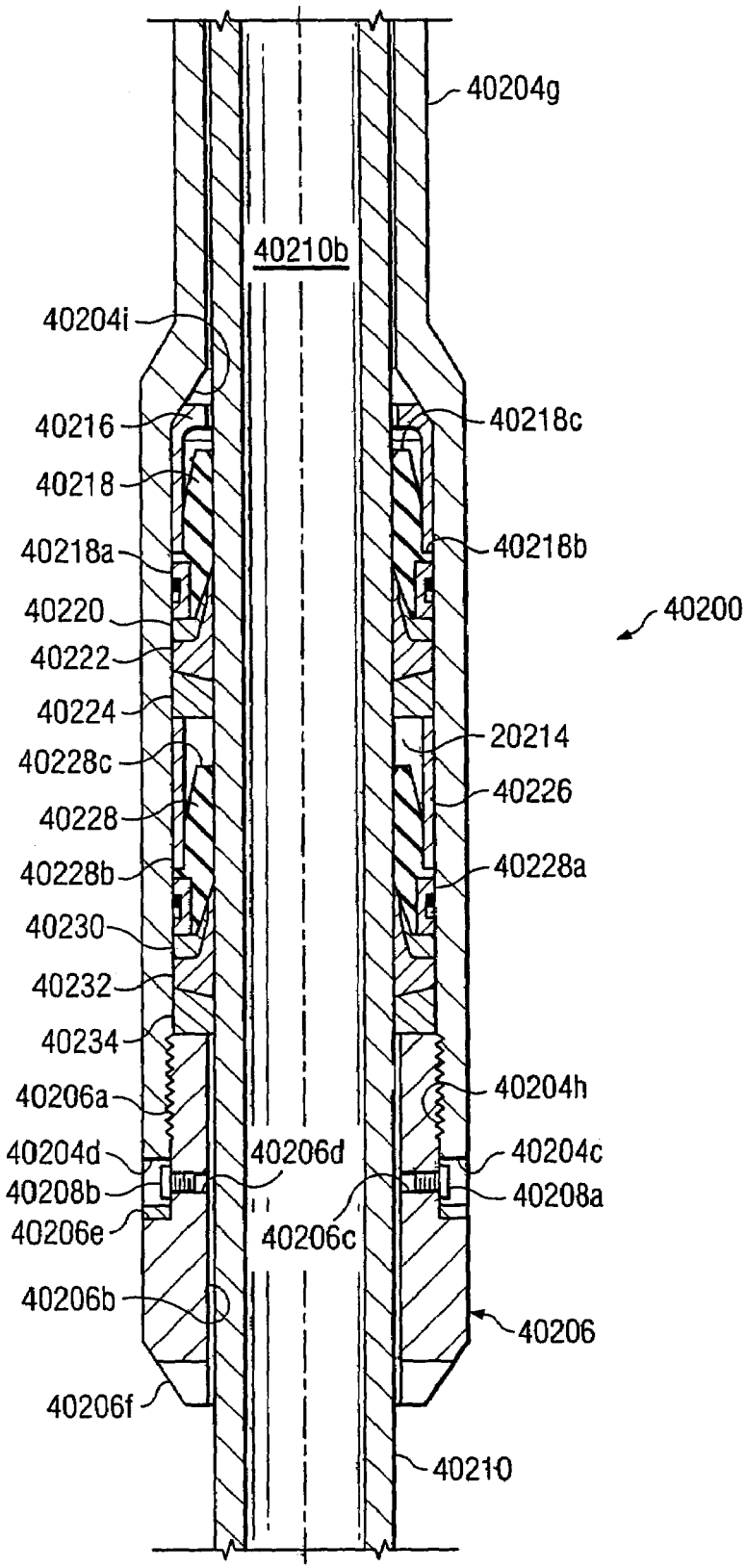
Figure 35C:
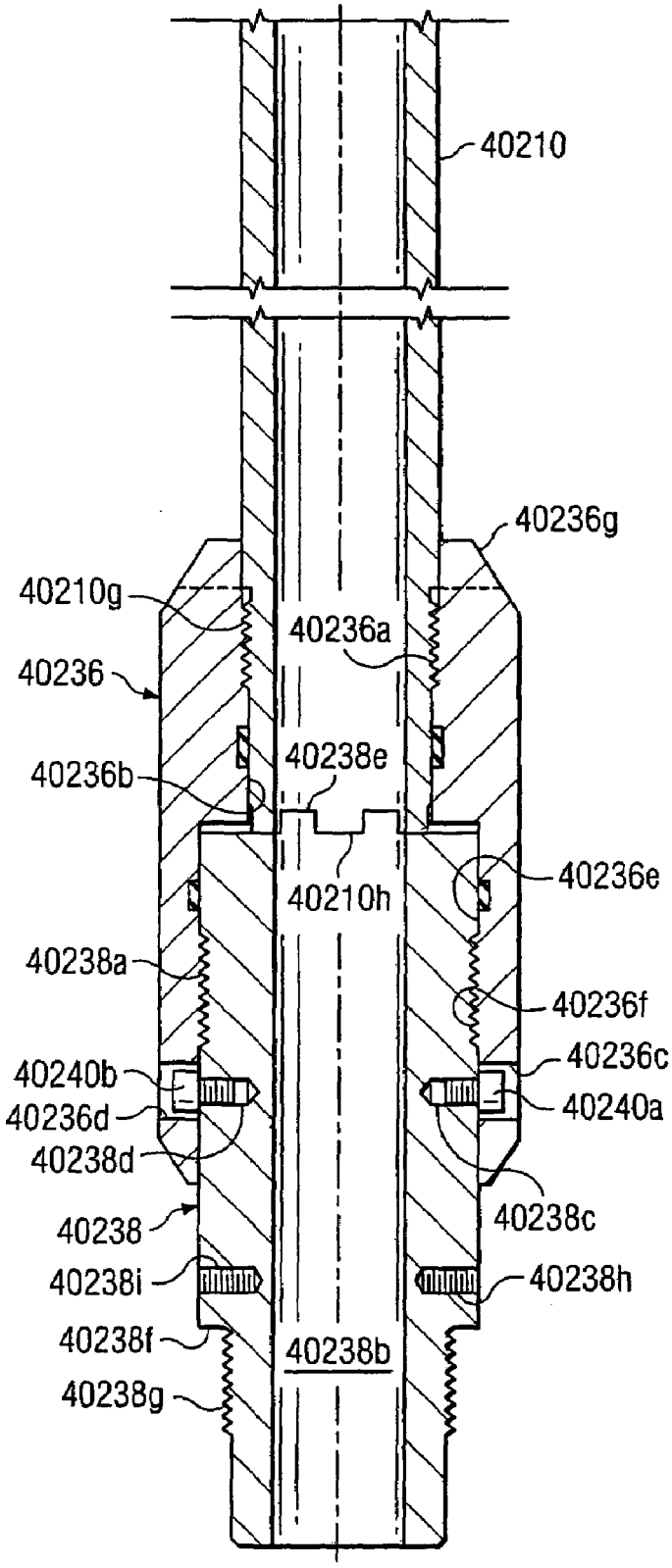

In an exemplary embodiment, as illustrated in FIGS. 35A through 35C, the lower subassembly 40200 includes a tubular support or adapter 40202 that defines a longitudinal passage 40202*a*, and includes radial passages, 40202*b* and 40202*c*, an external threaded connection 40202*d*, an external shoulder 40202*e*, and an internal annular recess 40202*f* having an internal threaded connection 40202*g*, radial openings, 40202*h*, 40202*i*, 40202*j* and 40202*k*, and a plurality of torque lugs 40202*l*. The adapter 40202 further includes an external annular recess 40202*m*.

A plurality of torque lugs 40204*a* at an end of a tubular support or lower lift adapter 40204 that defines a longitudinal passage 40204*b*, having a variable inside diameter, and radial openings, 40204*c* and 40204*d*, and includes an external threaded connection 40204*e*, an external shoulder 40204*f*, an external annular recess 40204*g* and an internal threaded connection 40204*h* at the other end, is adapted to engage and mesh with the plurality of torque lugs 40202*l* of the adapter 40202 under conditions to be described. The lower lift adapter 40204 further includes an internal shoulder 40204*i* and blind openings, 40204*j* and 40204*k*. In an exemplary embodiment, the external annular recess 40204*g* may be employed to place rig elevators or slips to run or retrieve the lower subassembly 40200 in a wellbore.

An external threaded connection 40206*a* at an end of a tubular support or torque retainer 40206 that defines a longitudinal passage 40206*b* and radial openings, 40206*c* and 40206*d*, and includes an external shoulder 40206*e* and a plurality of torque lugs 40206*f* at the other end, is coupled to the internal threaded connection 40204*h* of the lower lift adapter 40204 so that the other end of the lower lift adapter engages or is proximate the external shoulder 40206*e* of the torque retainer 40206, and so that the radial openings, 40204*c* and 40204*d*, and the radial openings, 40206*c* and 40206*d*, respectively, are generally axially aligned. Torque pins, 40208*a* and 40208*b*, extend within the generally axially aligned openings, 40204*c* and 40206*c*, and 40204*d* and 40206*d*, respectively, to lock the torque retainer 40206 to the lower lift adapter 40204.

An external threaded connection 40210*a* at an end of a tubular support or lower connecting rod 40210 that defines a longitudinal passage 40210*b* and radial openings, 40210*c*, 40210*d*, 40210*e* and 40210*f*, and includes an external threaded connection 40210*g* and a plurality of torque lugs 40210*h* at the other end, is coupled to the internal threaded connection 40202*g* of the adapter 40202 so that the lower connecting rod 40210 is received by and at least partially extends within the longitudinal passages 40202*a*, 40204*b* and 40206*b* of the adapter 40202, the lower lift adapter 40204 and the torque retainer 40206, respectively, and so that the radial openings, 40202*h*, 40202*i*, 40202*j* and 40202*k*, are generally axially aligned with the radial openings, 40210*c*, 40210*d*, 40210*e* and 40210*f*, respectively. Torque pins 40212*a*, 40212*b*, 40212*c* and 40212*d*, extend within the generally axially aligned openings, 40202*h* and 40210*c*, 40202*i* and 40210*d*, 40202*j* and 40210*e*, and 40202*k* and 40210*f*, respectively, to lock the lower connecting rod 40210 to the adapter 40202.

An annular region 40214 is defined between the outside surface of the lower connecting rod 40210 and the inside surface of the lower lift adapter 40204, and is generally axially defined between the external annular recess 40204*g* and the torque retainer 4026. A tubular sleeve or upper sleeve 40216 extends within the annular region 40214 and about the lower connecting rod 40210, and abuts the internal shoulder 40204*i* of the lower lift adapter 40204. A cup 40218 extends within the annular region 40214 and about the lower connecting rod 40210, and includes a ring 40218*a* and a shoulder 40218*b* that abuts the upper sleeve 40216, and a distal end 40218*c*. An inside thimble 40220 extends within the annular region 40214 and about the lower connecting rod 40210, and abuts and supports the cup 40218. A backup ring 40222 extends within the annular region 40214 and about the lower connecting rod 40210, and abuts the inside thimble 40220. An outside thimble 40224 extends within the annular region 40214 and about the lower connecting rod 40210, and abuts the backup ring 40222. A tubular sleeve 40226 extends within the annular region 40214 and about the lower connecting rod 40210, and abuts the outside thimble 40224. A cup 40228 extends within the annular region 40214 and about the lower connecting rod 40210, and includes a ring 40228*a* and a shoulder 40228*b* that abuts the sleeve 40226, and a distal end 40228*c*. An inside thimble 40230 extends within the annular region 40214 and about the lower connecting rod 40210, and abuts and supports the cup 40228. A backup ring 40232 extends within the annular region 40214 and about the lower connecting rod 40210, and abuts the inside thimble 40230. An outside thimble 40234 extends within the annular region 40214 and about the lower connecting rod 40210, and abuts the backup ring 40232. The torque retainer 40206 abuts the outside thimble 40234 and thereby holds the sleeve 40216, the cup 40218, the inside thimble 40220, the backup ring 40222, the outside thimble 40224, the sleeve 40226, the cup 40228, the inside thimble 40230, the backup ring 40232 and the outside thimble 40234 in place within the annular region 40214.

The distal ends 40218*c* and 40228*c* of the cups 40218 and 40228, respectively, axially extend towards the adapter 40202, and the cups sealingly engage the outside surface of the lower connecting rod 40210. In an exemplary embodiment, the lower lift adapter 40204 is free to move in either axial direction relative to the lower connecting rod 40210, under conditions to be described, while the cups 40218 and 40228 continue to sealingly engage the outside surface of the lower connecting rod 40210.

In several exemplary embodiments, the backup rings, 40222 and 40322, may be composed of Teflon and filled with glass and/or other types of materials, and/or may prevent extrusion of the cups, 40218 and 40228, during, for example, relative movement between the lower lift adapter 40204 and the lower connecting rod 40210. In an exemplary embodiment, the outside thimbles, 40224 and 40234, may be composed of steel. In several exemplary embodiments, the outside thimbles, 40224 and 40234, may be composed of bronze and/or any other bearing material suitable to prevent abrasion of the lower connecting rod 40210 during, for example, relative movement between the lower lift adapter 40204 and the lower connecting rod 40210. In an exemplary embodiment, the inside thimbles, 40220 and 40230, may be composed of steel and may provide support to the cups, 40218 and 40228.

In several exemplary embodiments, one or more cups may be added to the subassembly 40200 so that the one or more additional cups extend within the annular region 40214, with the distal ends of the additional cups axially extending towards the adapter 40202, or axially extending away from the adapter 40202 in order to, for example, act as a wiper to remove any debris from the outside surface of the lower connection rod 40210 during, for example, relative movement between the lower lift adapter 40204 and the lower connecting rod 40210. In several exemplary embodiments, for each additional cup, an inside thimble, a backup ring and an outside thimble may also be added to the subassembly 40200.

An internal threaded connection 40236*a* of a tubular support or coupling 40236 that defines a longitudinal passage 40236*b* and radial openings, 40236*c* and 40236*d*, and includes an internal annular recess 40236*e* having an internal threaded connection 40236*f*, is coupled to the external threaded connection 40210*g* of the lower connecting rod 40210 so that the lower connecting rod 40210 at least partially extends within the longitudinal passage 40236*b*. The coupling 40236 further includes a plurality of torque lugs 40236*g*. In several exemplary embodiments, the torque lugs 40236*g* are adapted to engage and mesh with the torque lugs 40206*f* of the torque retainer 40206 under conditions to be described.

An external threaded connection 40238*a* of a tubular support or lower nipple 40238 that defines a longitudinal passage 40238*b* and openings, 40238*c* and 40238*d*, and includes a plurality of torque lugs 40238*e* at an end, an external shoulder 40238*f* and an external threaded connection 40238*g* at the other end, is coupled to the internal threaded connection 40236*f* of the coupling 40236 so that the lower nipple 40238 at least partially extends within the longitudinal passage 40236*b* of the coupling 40236, the torque lugs 40238*b* engage and mesh with the torque lugs 40210*h* of the lower connecting rod 40210, and the openings, 40236*c* and 40236*d*, are generally axially aligned with the openings, 40238*c* and 40238*d*, respectively. The lower nipple 40238 further includes openings, 40238*h* and 40238*i*.

In an exemplary embodiment, the external threaded connection 40210*g* of the lower connecting rod 40210 and the internal threaded connection 40236*a* of the coupling 40236 may each be a right-hand threaded connection, and the internal threaded connection 40236*f* of the coupling 40236 and the external threaded connection 40238*a* may each be a left-hand threaded connection. The coupling 40236 may then be coupled to the lower connecting rod 40210 and the lower nipple 40238 at the same time so that, as the coupling 40236 is rotated clockwise, the threaded coupling between the external threaded connection 40210*g* and the internal threaded connection 40236*a* pulls the torque lugs 40210*h* towards the torque lugs 40238*e*, and the threaded coupling between the internal threaded connection 40236*f* and the external threaded connection 40238*a* pulls the torque lugs 40238*e* towards the torque lugs 40210*h*, until the pluralities of torque lugs 40210*h* and 40238*e* engage and mesh with each other.

Torque pins, 40240*a* and 40240*b*, extend into the generally axially aligned openings, 40236*c* and 40238*c*, and 40236*d* and 40238*d*, respectively, to lock the coupling 40236 to the lower nipple 40238.

Figure 36A:
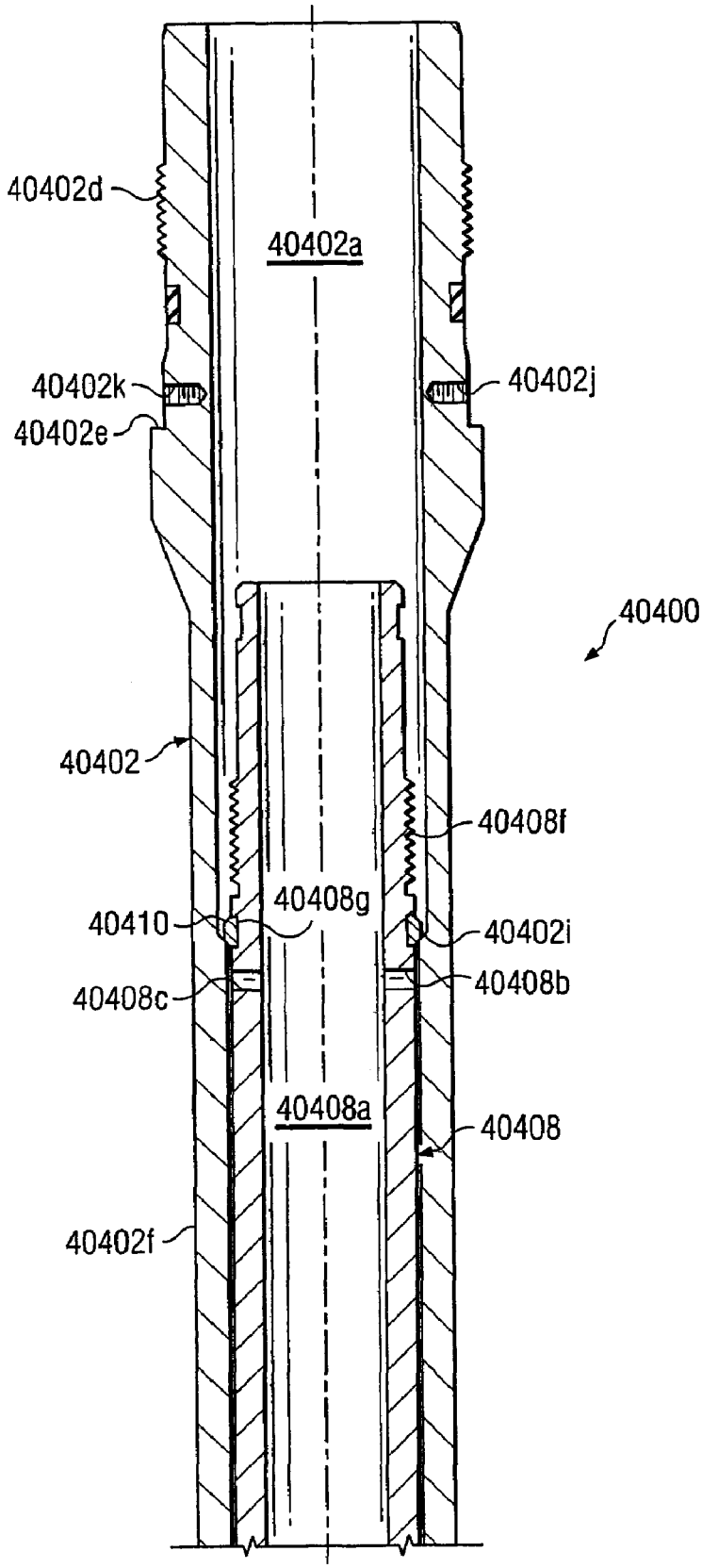
FIGS. 36A to 36C is a fragmentary cross-sectional illustration of an exemplary embodiment of a middle subassembly of the tension actuator assembly of FIG. 34.
Figure 36B:
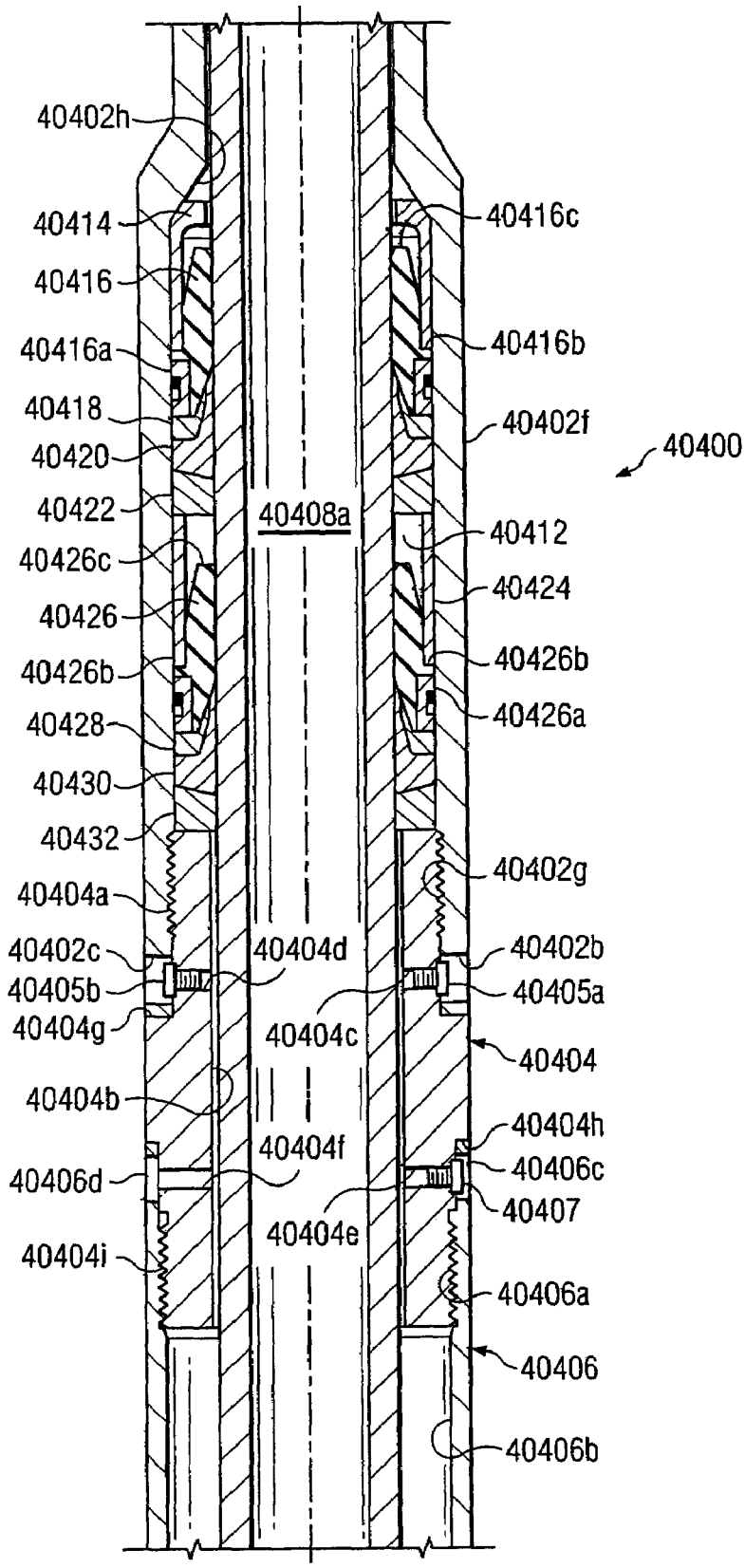
Figure 36C:
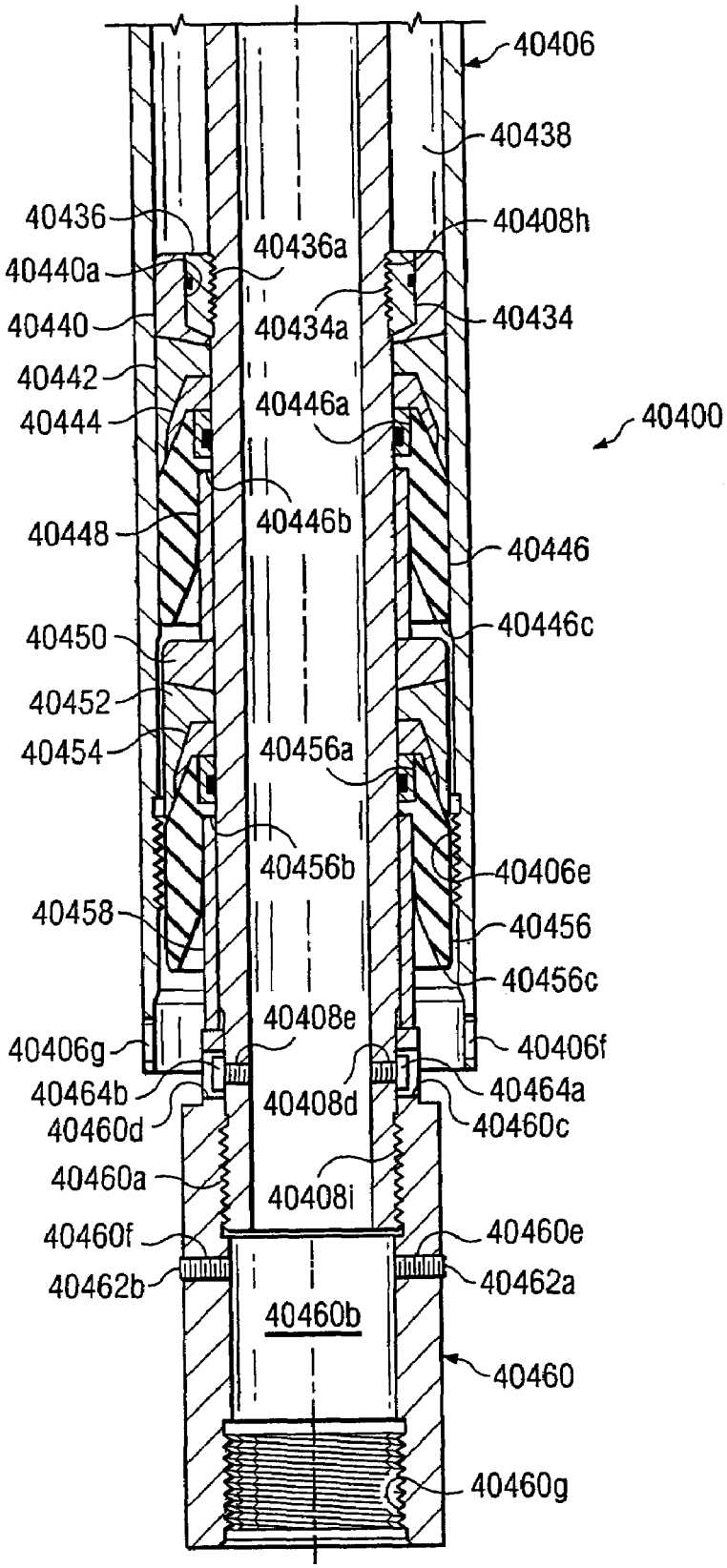

In an exemplary embodiment, as illustrated in FIGS. 36A through 36C, the middle subassembly 40400 includes a tubular support or middle lift adapter 40402 that defines a longitudinal passage 40402*a*, having a variable inside diameter, and radial openings, 40402*b* and 40402*c*, and includes an external threaded connection 40402*d* and an external shoulder 40402*e* at an end, an external annular recess 40402*f*, and an internal threaded connection 40402*g* at the other end. The middle lift adapter 40402 further includes an internal shoulder 40402*h*, an internal shoulder 40402*i*, and blind openings, 40402*j* and 40402*k*. In an exemplary embodiment, the external annular recess 40402*f* may be employed to place rig elevators or slips to run or retrieve the middle subassembly 40400 in a wellbore.

An external threaded connection 40404*a* of a tubular support or retainer 40404 that defines a longitudinal passage 40404*b*, radial openings, 40404*c* and 40404*d*, a plurality of circumferentially-spaced radial openings 40404*e*, one of which is shown, and a plurality of circumferentially-spaced ports 40404*f*, one of which is shown, that are circumferentially interspersed with the openings 40404*e*, and includes an external shoulder 40404*g*, an external shoulder 40404*h* and an external threaded connection 40404*i*, is coupled to the internal threaded connection 40402*g* of the middle lift adapter 40402 so that the radial openings, 40402*b* and 40402*c*, are generally axially aligned with the radial openings, 40404*c* and 40404*d*, respectively. A torque pin 40405*a* extends through the generally axially aligned openings 40402*b* and 40404*c*, and a torque pin 40405*b* extends through the generally axially aligned openings 40402*c* and 40404*d*, to lock the retainer 40404 to the middle lift adapter 40402.

An internal threaded connection 40406*a* at an end of a tubular support or barrel 40406 that defines a longitudinal passage 40406*b*, a plurality of radial openings 40406*c*, one of which is shown, a plurality of radial openings 40406*d*, one of which is shown, that are circumferentially interspersed with the openings 40406*c*, and includes an internal threaded connection 40406*e* at the other end, is coupled to the external threaded connection 40404*i* of the retainer 40404 so that the openings, 40404*e* and 40404*f*, are generally axially aligned with respective radial openings of the plurality of radial openings, 40406*c* and 40406*d*, respectively. The barrel 4046 further defines radial openings, 40406*f* and 40406*g*. A plurality of torque pins 40407, one of which is shown, extends through each pair of generally axially aligned openings, 40404*e* and 40406*c*, to lock the barrel 40406 to the retainer 40404.

A tubular support or connecting rod 40408 that defines a longitudinal passage 40408*a*, radial openings, 40408*b* and 40408*c*, and radial openings, 40408*d* and 40408*e*, and includes an external threaded connection 40408*f* and an external annular recess 40408*g* at an end, external teeth 40408*h*, and an external threaded connection 40408*i* at the other end, at least partially extends within the longitudinal passage 40402*a*, 40404*b*, 40406*b* of the middle lift adapter 40402, the retainer 40404 and the barrel 40406, respectively. The connecting rod 40408 further includes an external annular recess 40408*j*.

A retaining ring 40410 is disposed in the external annular recess 40408*g* and is adapted to engage the internal shoulder 40402*i* of the middle lift adapter 40402 to prevent the connecting rod 40408 from moving axially downward and out of the barrel 40406 during, for example, the coupling of the middle subassembly 40400 to the lower subassembly 40200.

An annular region 40412 is defined between the outside surface of the connecting rod 40408 and the inside surface of the middle lift adapter 40402, and is generally axially defined between the internal shoulder 40402*h* and the retainer 40404. A tubular sleeve or upper sleeve 40414 extends within the annular region 40412 and about the connecting rod 40408, and abuts the internal shoulder 40402*h* of the middle lift adapter 40402. A cup 40416 extends within the annular region 40412 and about the connecting rod 40408, and includes a ring 40416*a* and a shoulder 40416*b* that abuts the upper sleeve 40414, and a distal end 40416*c*. An inside thimble 40418 extends within the annular region 40412 and about the connecting rod 40408, and abuts and supports the cup 40416. A backup ring 40420 extends within the annular region 40412 and about the connecting rod 40408, and abuts the inside thimble 40418. An outside thimble 40422 extends within the annular region 40422 and about the connecting rod 40408, and abuts the backup ring 40420. A tubular sleeve 40424 extends within the annular region 40422 and about the connecting rod 40408, and abuts the outside thimble 40422. A cup 40426 extends within the annular region 40412 and about the connecting rod 40408, and includes a ring 40426*a* and a shoulder 40426*b* that abuts the sleeve 40424, and a distal end 40416*c*. An inside thimble 40428 extends within the annular region 40412 and about the connecting rod 40408, and abuts and supports the cup 40426. A backup ring 40430 extends within the annular region 40412 and about the connecting rod 40408, and abuts the inside thimble 40428. An outside thimble 40432 extends within the annular region 40422 and about the connecting rod 40408, and abuts the backup ring 40430. The retainer 40404 abuts the outside thimble 40432 and thereby holds the sleeve 40414, the cup 40416, the inside thimble 40418, the backup ring 40420, the outside thimble 40422, the sleeve 40424, the cup 40426, the inside thimble 40428, the backup ring 40430 and the outside thimble 40432 in place within the annular region 40412.

The distal ends 40416*c* and 40426*c* of the cups 40416 and 40426, respectively, axially extend towards the internal shoulder 40402*h* of the middle lift adapter 40402, and the cups sealingly engage the outside surface of the connecting rod 40408. In an exemplary embodiment, the middle lift adapter 40402 is free to move in either axial direction relative to the connecting rod 40408, under conditions to be described, while the cups 40416 and 40426 continue to sealingly engage the outside surface of the connecting rod 40408.

In several exemplary embodiments, the backup rings, 40420 and 40430, may be composed of Teflon and filled with glass and/or other types of materials, and/or may prevent extrusion of the cups, 40416 and 40426, during, for example, relative movement between the middle lift adapter 40402 and the connecting rod 40408. In an exemplary embodiment, the outside thimbles, 40422 and 40432, may be composed of steel. In several exemplary embodiments, the outside thimbles, 40422 and 40432, may be composed of bronze and/or any other bearing material suitable to prevent abrasion of the connecting rod 40408 during, for example, relative movement between the middle lift adapter 40402 and the connecting rod 40408. In an exemplary embodiment, the inside thimbles, 40418 and 40428, may be composed of steel and may provide support to the cups, 40416 and 40426.

Internal teeth, 40434*a* and 40436*a*, of retaining dogs, 40434 and 40436, respectively, engage and mesh with the external teeth 40408*h* of the connecting rod 40408. An annular region 40438 is defined between the outside surface of the connecting rod 40408 and the inside surface of the barrel 40406. An internal annular recess 40440*a* of an upper thimble 40440 abuts the retaining dogs, 40434 and 40436, so that the upper thimble extends within the annular region 40438 and about the connecting rod 40408.

A backup ring 40442 extends within the annular region 40438 and about the connecting rod 40408, and abuts the upper thimble 40440. An inside thimble 40444 extends within the annular region 40438 and about the connecting rod 40408, and abuts the backup ring 40442. A cup 40446 extends within the annular region 40438 and about the connecting rod 40408, includes a ring 40446*a*, a shoulder 40446*b* and a distal end 40446*c*, and abuts and is supported by the inside thimble 40444. A sleeve 40448 extends within the annular region 40438 and about the connecting rod 40408, and abuts the shoulder 40446*b* of the cup 40446. An outside thimble 40450 extends within the annular region 40438 and about the connecting rod 40408, and abuts the sleeve 40448. A backup ring 40452 extends within the annular region 40438 and about the connecting rod 40408, and abuts the outside thimble 40450. An inside thimble 40454 extends within the annular region 40438 and about the connecting rod 40408, and abuts the backup ring 40452. A cup 40456 extends within the annular region 40438 and about the connecting rod 40408, includes a ring 40456*a*, a shoulder 40456*b* and a distal end 40456*c*, and abuts and is supported by the inside thimble 40454. A tubular sleeve 40458 at least partially extends within the annular region 40438 and about the connecting rod 40408, and abuts the shoulder 40456*b* of the cup 40456.

The distal ends 40446*c* and 40456*c* of the cups 40446 and 40456, respectively, axially extend away from the internal shoulder 40402*h* of the middle lift adapter 40402, and the cups sealingly engage the outside surface of the connecting rod 40408. In an exemplary embodiment, the middle lift adapter 40402 is free to move in either axial direction relative to the connecting rod 40408, under conditions to be described.

In several exemplary embodiments, the backup rings, 40442 and 40452, may be composed of Teflon and filled with glass and/or other types of materials, and/or may prevent extrusion of the cups, 40446 and 40456, during, for example, relative movement between the middle lift adapter 40402 and the connecting rod 40408. In an exemplary embodiment, the outside thimbles, 40440 and 40450, may be composed of steel. In several exemplary embodiments, the outside thimbles, 40440 and 40450, may be composed of bronze and/or any other bearing material suitable to prevent abrasion of the connecting rod 40408 during, for example, relative movement between the middle lift adapter 40402 and the connecting rod 40408. In an exemplary embodiment, the inside thimbles, 40444 and 40454, may be composed of steel and may provide support to the cups, 40446 and 40456.

An internal threaded connection 40460*a* at an end of a tubular support or coupling 40460 that defines a longitudinal passage 40460*b*, radial openings, 40460*c* and 40460*d*, and radial openings, 40460*e* and 40460*f*, and includes an internal threaded connection 40460*g* at the other end, is coupled to the external threaded connection 40408*i* of the connecting rod 40408 so that the radial openings, 40460*c* and 40460*d*, are generally axially aligned with the radial openings, 40408*d* and 40408*e*, respectively, and so that the end of the coupling 40460 abuts the sleeve 40458 to hold the sleeve 40458, the cup 40456, the inside thimble 40454, the backup ring 40452, the outside thimble 40450, the sleeve 40448, the cup 40446, the inside thimble 40444, the backup ring 40442 and the upper thimble 40440 in place.

Set screws, 40462*a* and 40462*b*, extend within the openings 40460*e* and 40460*f*, respectively. A torque pin 40464*a* extends through the generally axially aligned radial openings 40460*c* and 40408*d*, and a torque pin 40464*b* extends through the generally axially aligned radial openings 40460*d* and 40408*e*, to lock the connecting rod 40408 to the coupling 40460.

In an exemplary embodiment, the middle subassemblies 40600, 40800 and 401000 are each substantially identical to the middle subassembly 40400 and therefore will not be described in detail. In the description below, any reference numeral used to refer to one or more features of one or more of the middle subassemblies 40600, 40800 and 401000 will correspond to the reference numeral for the one or more features of the middle subassembly 40400, except that the third numeral position, that is, 4, will be replaced by 6, 8 or 10 for the middle subassembly 40600, 40800 or 401000, respectively.

Figure 37A:
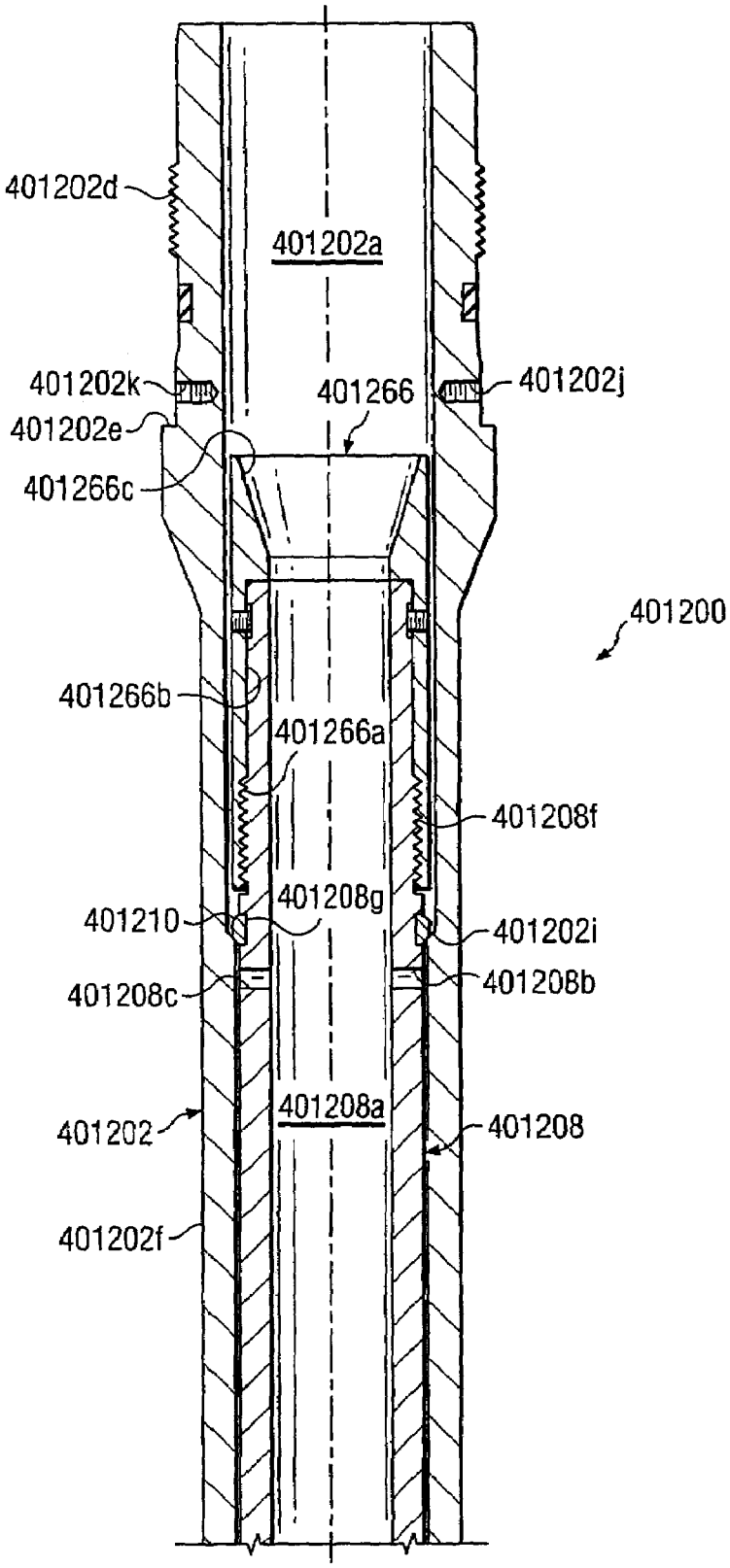
FIGS. 37A to 37C is a fragmentary cross-sectional illustration of an exemplary embodiment of an upper subassembly of the tension actuator assembly of FIG. 34.
Figure 37B:
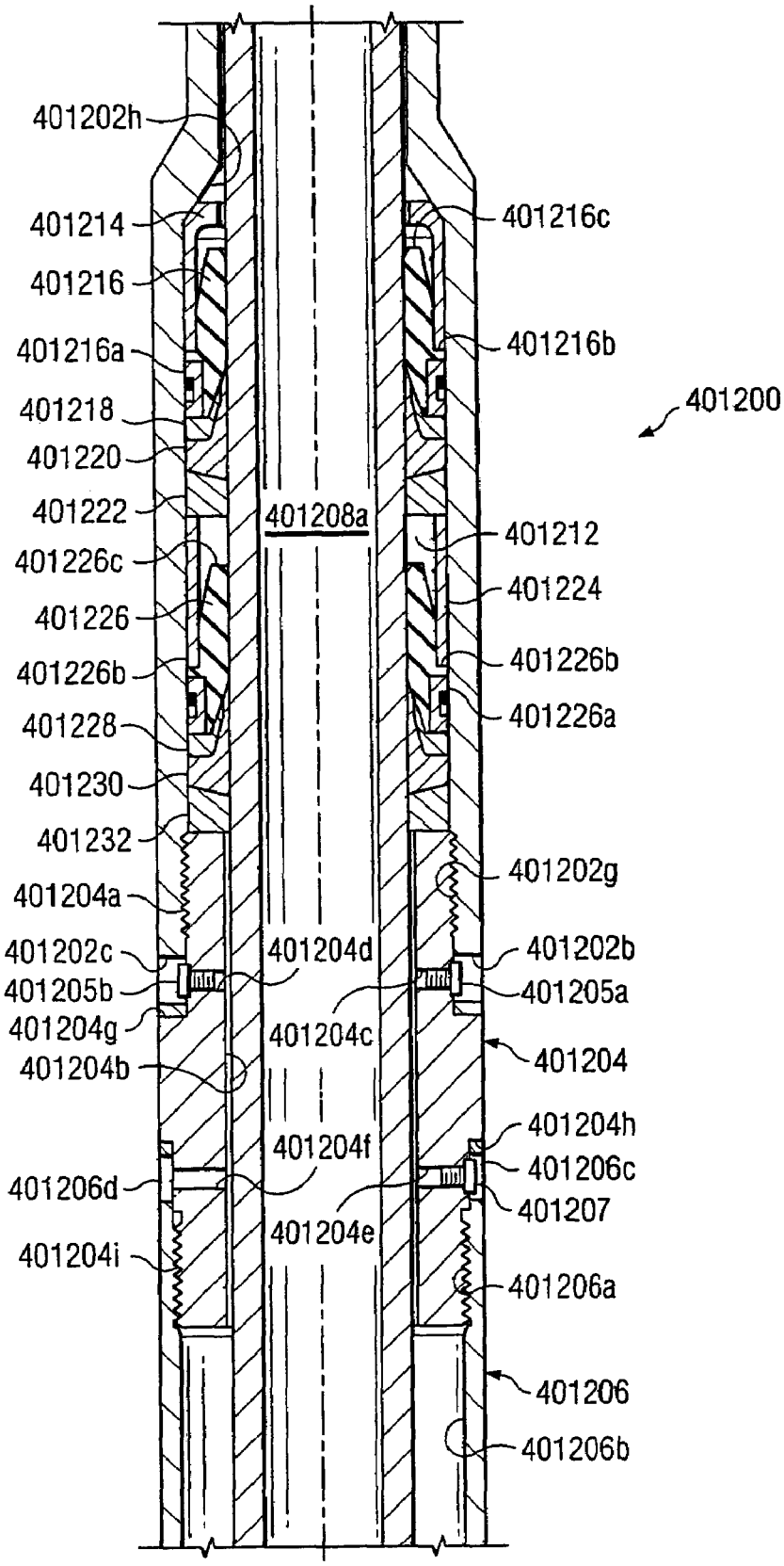
Figure 37C:
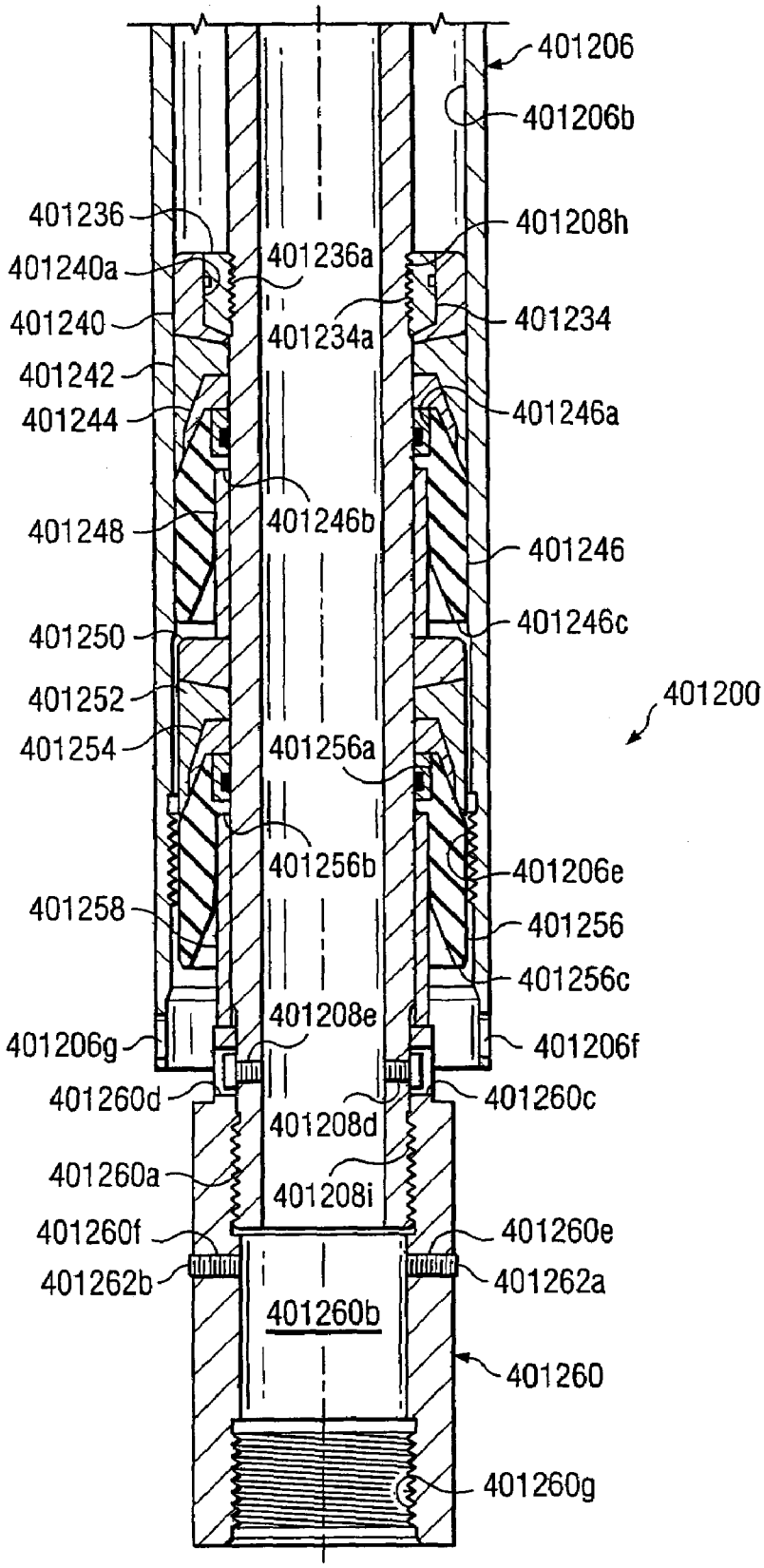

In an exemplary embodiment, as illustrated in FIGS. 37A through 37C, the upper subassembly 401200 is substantially similar to the middle subassembly 40400. More particularly, the upper subassembly 401200 includes a tubular support or upper lift adapter 401202 that defines a longitudinal passage 401202*a*, having a variable inside diameter, and radial openings, 401202*b* and 401202*c*, and includes an external threaded connection 401202*d* and an external shoulder 401202*e* at an end, an external annular recess 401202*f*, and an internal threaded connection 401202*g* at the other end. The upper lift adapter 401202 further includes an internal shoulder 401202*h*, an internal shoulder 401202*i*, and blind openings, 401202*j* and 401202*k*. In an exemplary embodiment, the external annular recess 401202*f* may be employed to place rig elevators or slips to run or retrieve the middle subassembly 401200 in a wellbore.

An external threaded connection 401204*a* of a tubular support or retainer 401204 that defines a longitudinal passage 401204*b*, radial openings, 401204*c* and 401204*d*, a plurality of circumferentially-spaced radial openings 401204*e*, one of which is shown, and a plurality of circumferentially-spaced ports 401204*f*, one of which is shown, that are circumferentially interspersed with the openings 401204*e*, and includes an external shoulder 401204*g*, an external shoulder 401204*h* and an external threaded connection 401204*i*, is coupled to the internal threaded connection 401202*g* of the upper lift adapter 401202 so that the radial openings, 401202*b* and 401202*c*, are generally axially aligned with the radial openings, 401204*c* and 401204*d*, respectively. A torque pin 401205*a* extends through the generally axially aligned openings 401202*b* and 401204*c*, and a torque pin 401205*b* extends through the generally axially aligned openings 401202*c* and 401204*d*, to lock the retainer 401204 to the upper lift adapter 401202.

An internal threaded connection 401206*a* at an end of a tubular support or barrel 401206 that defines a longitudinal passage 401206*b*, a plurality of radial openings 401206*c*, one of which is shown, a plurality of radial openings 401206*d*, one of which is shown, that are circumferentially interspersed with the openings 401206*c*, and includes an internal threaded connection 401206*e* at the other end, is coupled to the external threaded connection 401204*i* of the retainer 401204 so that the openings, 401204*e* and 401204*f*, are generally axially aligned with respective radial openings of the plurality of radial openings, 401206*c* and 401206*d*, respectively. The barrel 401206 further defines radial openings, 401206*f* and 401206*g*. A plurality of torque pins 401207, one of which is shown, extends through each pair of generally axially aligned openings 401204*e* and 401206*c*, to lock the barrel 401206 to the retainer 401204.

A tubular support or connecting rod 401208 that defines a longitudinal passage 401208*a*, radial openings, 401208*b* and 401208*c*, and radial openings, 401208*d* and 401208*e*, and includes an external threaded connection 401208*f* and an external annular recess 401208*g* at an end, external teeth 401208*h*, and an external threaded connection 401208*i* at the other end, at least partially extends within the longitudinal passage 401202*a*, 401204*b*, 401206*b* of the upper lift adapter 401202, the retainer 401204 and the barrel 401206, respectively.

A retaining ring 401210 is disposed in the external annular recess 401208*g* and is adapted to engage the internal shoulder 401202*i* of the upper lift adapter 401202 to prevent the connecting rod 401208 from moving axially downward and completely out of the barrel 401206 during, for example, the coupling of the upper subassembly 401200 to the middle subassembly 401000.

An annular region 401212 is defined between the outside surface of the connecting rod 401208 and the inside surface of the upper lift adapter 401202, and is generally axially defined between the internal shoulder 401202*h* and the retainer 401204. A tubular sleeve or upper sleeve 401214 extends within the annular region 401212 and about the connecting rod 401208, and abuts the internal shoulder 401202*h* of the upper lift adapter 401202. A cup 401216 extends within the annular region 401212 and about the connecting rod 401208, and includes a ring 401216*a* and a shoulder 401216*b* that abuts the upper sleeve 401214, and a distal end 401216*c*. An inside thimble 401218 extends within the annular region 401212 and about the connecting rod 401208, and abuts and supports the cup 401216. A backup ring 401220 extends within the annular region 401212 and about the connecting rod 401208, and abuts the inside thimble 401218. An outside thimble 401222 extends within the annular region 401222 and about the connecting rod 401208, and abuts the backup ring 401220. A tubular sleeve 401224 extends within the annular region 401222 and about the connecting rod 401208, and abuts the outside thimble 401222. A cup 401226 extends within the annular region 401212 and about the connecting rod 401208, and includes a ring 401226*a* and a shoulder 401226*b* that abuts the sleeve 401224, and a distal end 401216*c*. An inside thimble 401228 extends within the annular region 401212 and about the connecting rod 401208, and abuts and supports the cup 401226. A backup ring 401230 extends within the annular region 401212 and about the connecting rod 401208, and abuts the inside thimble 401228. An outside thimble 401232 extends within the annular region 401222 and about the connecting rod 401208, and abuts the backup ring 401230. The retainer 401204 abuts the outside thimble 401232 and thereby holds the sleeve 401214, the cup 401216, the inside thimble 401218, the backup ring 401220, the outside thimble 401222, the sleeve 401224, the cup 401226, the inside thimble 401228, the backup ring 401230 and the outside thimble 401232 in place within the annular region 401212.

The distal ends 401216*c* and 401226*c* of the cups 401216 and 401226, respectively, axially extend towards the internal shoulder 401202*h* of the upper lift adapter 401202, and the cups sealingly engage the outside surface of the connecting rod 401208. In an exemplary embodiment, the upper lift adapter 401202 is free to move in either axial direction relative to the connecting rod 401208, under conditions to be described, while the cups 401216 and 401226 continue to sealingly engage the outside surface of the connecting rod 401208.

In several exemplary embodiments, the backup rings, 401220 and 401230, may be composed of Teflon and filled with glass and/or other types of materials, and/or may prevent extrusion of the cups, 401216 and 401226, during, for example, relative movement between the upper lift adapter 401202 and the connecting rod 401208. In an exemplary embodiment, the outside thimbles, 401222 and 401232, may be composed of steel. In several exemplary embodiments, the outside thimbles, 401222 and 401232, may be composed of bronze and/or any other bearing material suitable to prevent abrasion of the connecting rod 401208 during, for example, relative movement between the upper lift adapter 401202 and the connecting rod 401208. In an exemplary embodiment, the inside thimbles, 401218 and 401228, may be composed of steel and may provide support to the cups, 401216 and 401226.

Internal teeth, 401234*a* and 401236*a*, of retaining dogs, 401234 and 401236, respectively, engage and mesh with the external teeth 401208*h* of the connecting rod 401208. An annular region 401238 is defined between the outside surface of the connecting rod 401208 and the inside surface of the barrel 401206. An internal annular recess 401240*a* of an upper thimble 401240 abuts the retaining dogs, 401234 and 401236, so that the upper thimble extends within the annular region 401238 and about the connecting rod 401208.

A backup ring 401242 extends within the annular region 401238 and about the connecting rod 401208, and abuts the upper thimble 401240. An inside thimble 401244 extends within the annular region 401238 and about the connecting rod 401208, and abuts the backup ring 401242. A cup 401246 extends within the annular region 401238 and about the connecting rod 401208, includes a ring 401246*a*, a shoulder 401246*b* and a distal end 401246*c*, and abuts and is supported by the inside thimble 401244. A sleeve 401248 extends within the annular region 401238 and about the connecting rod 401208, and abuts the shoulder 401246*b* of the cup 401246. An outside thimble 401250 extends within the annular region 401238 and about the connecting rod 401208, and abuts the sleeve 401248. A backup ring 401252 extends within the annular region 401238 and about the connecting rod 401208, and abuts the outside thimble 401250. An inside thimble 401254 extends within the annular region 401238 and about the connecting rod 401208, and abuts the backup ring 401252. A cup 401256 extends within the annular region 401238 and about the connecting rod 401208, includes a ring 401256*a*, a shoulder 401256*b* and a distal end 401256*c*, and abuts and is supported by the inside thimble 401254. A tubular sleeve 401258 at least partially extends within the annular region 401238 and about the connecting rod 401208, and abuts the shoulder 401256*b* of the cup 401256.

The distal ends 401246*c* and 401256*c* of the cups 401246 and 401256, respectively, axially extend away from the internal shoulder 401202*h* of the upper lift adapter 401202, and the cups sealingly engage the outside surface of the connecting rod 401208. In an exemplary embodiment, the upper lift adapter 401202 is free to move in either axial direction relative to the connecting rod 401208, under conditions to be described.

In several exemplary embodiments, the backup rings, 401242 and 401252, may be composed of Teflon and filled with glass and/or other types of materials, and/or may prevent extrusion of the cups, 401246 and 401256, during, for example, relative movement between the upper lift adapter 401202 and the connecting rod 401208. In an exemplary embodiment, the outside thimbles, 401240 and 401250, may be composed of steel. In several exemplary embodiments, the outside thimbles, 401240 and 401250, may be composed of bronze and/or any other bearing material suitable to prevent abrasion of the connecting rod 401208 during, for example, relative movement between the upper lift adapter 401202 and the connecting rod 401208. In an exemplary embodiment, the inside thimbles, 401244 and 401254, may be composed of steel and may provide support to the cups, 401246 and 401256.

An internal threaded connection 401260*a* at an end of a tubular support or collar 401260 that defines a longitudinal passage 401260*b*, radial openings, 401260*c* and 401260*d*, and radial openings, 401260*e* and 401260*f*, and includes an internal threaded connection 401260*g* at the other end, is coupled to the external threaded connection 401208*i* of the connecting rod 401208 so that the radial openings, 401260*c* and 401260*d*, are generally axially aligned with the radial openings, 401208*d* and 401208*e*, respectively, and so that the end of the collar 401260 abuts the sleeve 401258 to hold the sleeve 401258, the cup 401256, the inside thimble 401254, the backup ring 401252, the outside thimble 401250, the sleeve 401248, the cup 401246, the inside thimble 401244, the backup ring 401242 and the upper thimble 401240 in place.

Set screws, 401262*a* and 401262*b*, extend within the openings 401260*e* and 401260*f*, respectively. A torque pin 401264*a* extends through the generally axially aligned radial openings 401260*c* and 401208*d*, and a torque pin 401264*b* extends through the generally axially aligned radial openings 401260*d* and 401208*e*, to lock the connecting rod 401208 to the collar 401260.

An internal threaded connection 401266*a* at an end of a tubular support or guide 401266 that defines a longitudinal passage 401266*b* and an internal tapered surface 401266*c* at the other end, and includes an internal annular recess 401266*d* and a plurality of radial openings 401266*e*, is coupled to the external threaded connection 401208*f* of the connecting rod 401208 so that the connecting rod 401208 is at least partially received by the internal annular recess 401266*d*. A plurality of fasteners 401266*f*, such as set screws, extend through the respective openings 401266*e* and into the external annular recess 410208*j* to lock the guide 401266 to the connecting rod 401208.

Figure 38A:
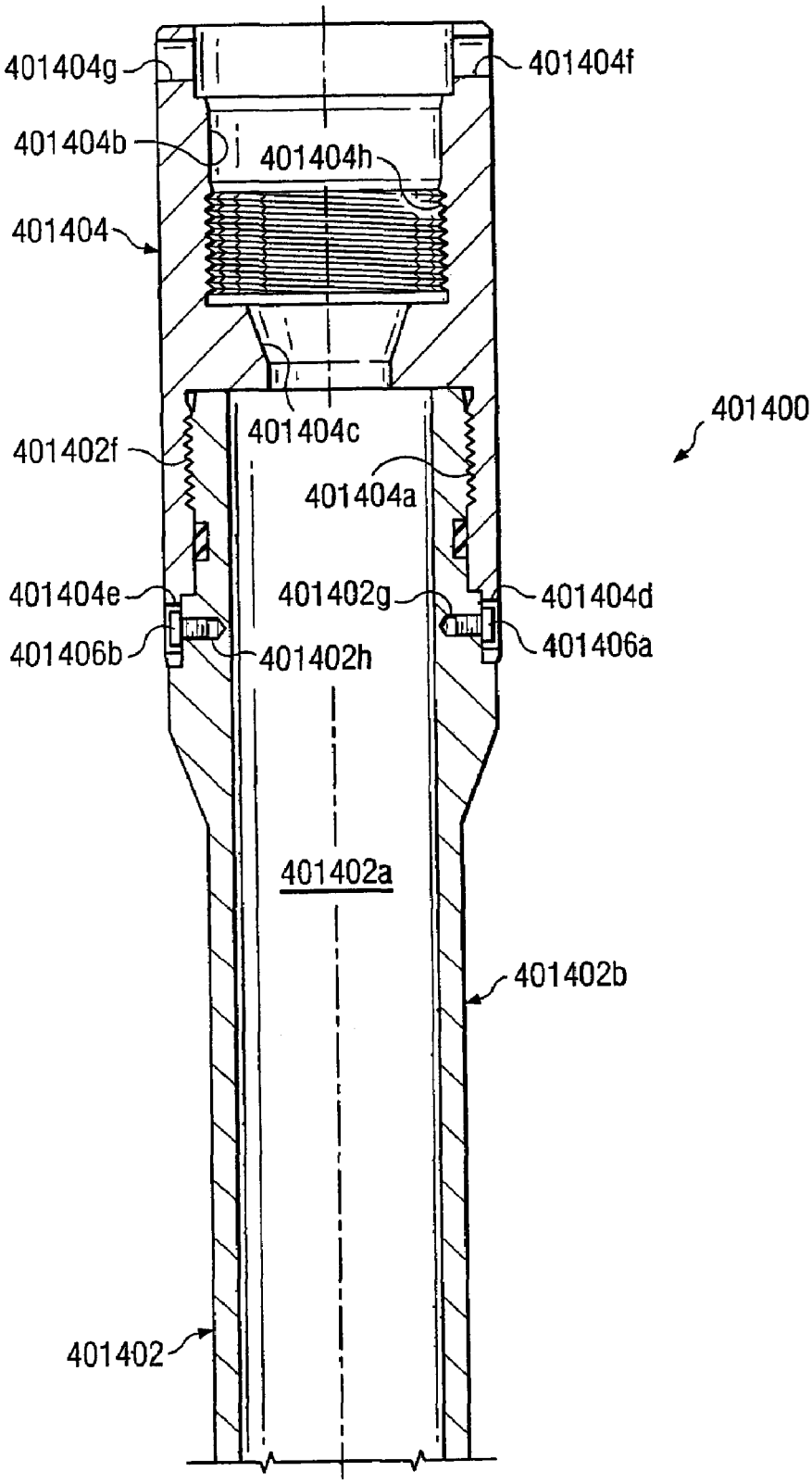
FIGS. 38A and 38B is a fragmentary cross-sectional illustration of an exemplary embodiment of a top subassembly of the tension actuator assembly of FIG. 34.
Figure 38B:
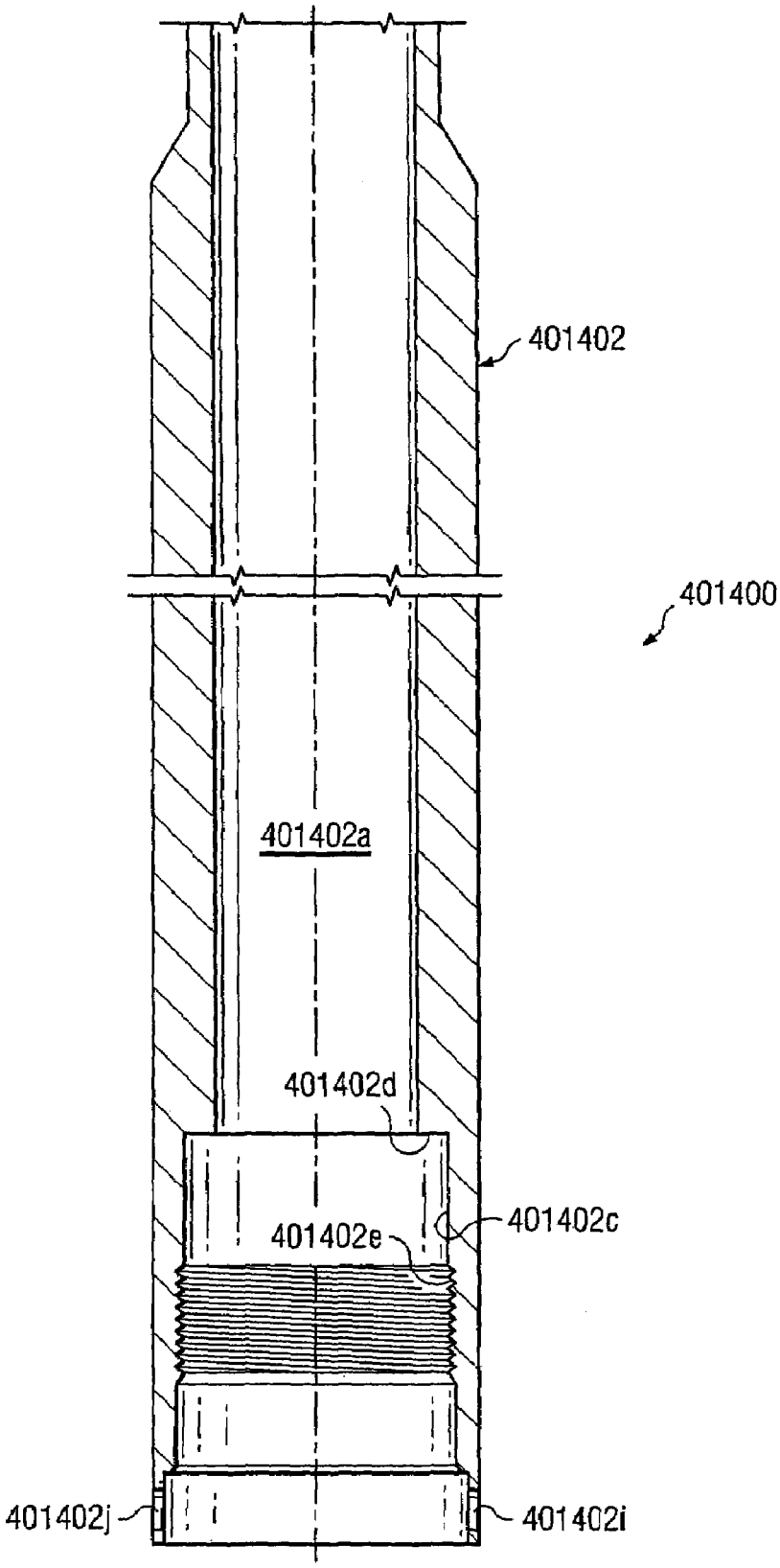

In an exemplary embodiment, as illustrated in FIGS. 38A and 38B, the top subassembly 401400 includes a tubular support or top barrel 401402 that defines a longitudinal passage 401402*a* and includes an external annular recess 401402*b*, and an internal annular recess 401402*c* that defines an internal shoulder 401402*d*, and includes an internal threaded connection 401402*e* at an end and an external threaded connection 401402*f* at the other end. The top barrel 401402 further defines blind openings, 401402*g* and 401402*h*, and openings 401402*i* and 401402*j*. In an exemplary embodiment, the external annular recess 401402*b* may be employed to place rig elevators or slips to run or retrieve the top subassembly 401400 in a wellbore.

An internal threaded connection 401404*a* at an end of a tubular support or coupling 401404 that defines a longitudinal passage 401404*b* having a varying diameter and including a throat portion 401404*c*, radial openings, 401404*d* and 401404*e*, and radial openings, 401404*f* and 401404*g* at the other end, and includes an internal threaded connection 401404*h* at the other end, is coupled to the external threaded connection 401402*f* of the top barrel 401402 so that the openings, 401404*d* and 401404*e*, are generally axially aligned with the openings, 401402*g* and 401402*h*, respectively. A torque pin 401406*a* extends through the generally aligned openings 401404*d* and 401402*g*, and a torque pin 401406*b* extends through the generally aligned openings 401404*e* and 401402*h*, to lock the top barrel 401402 to the coupling 401404.

Figure 39A:
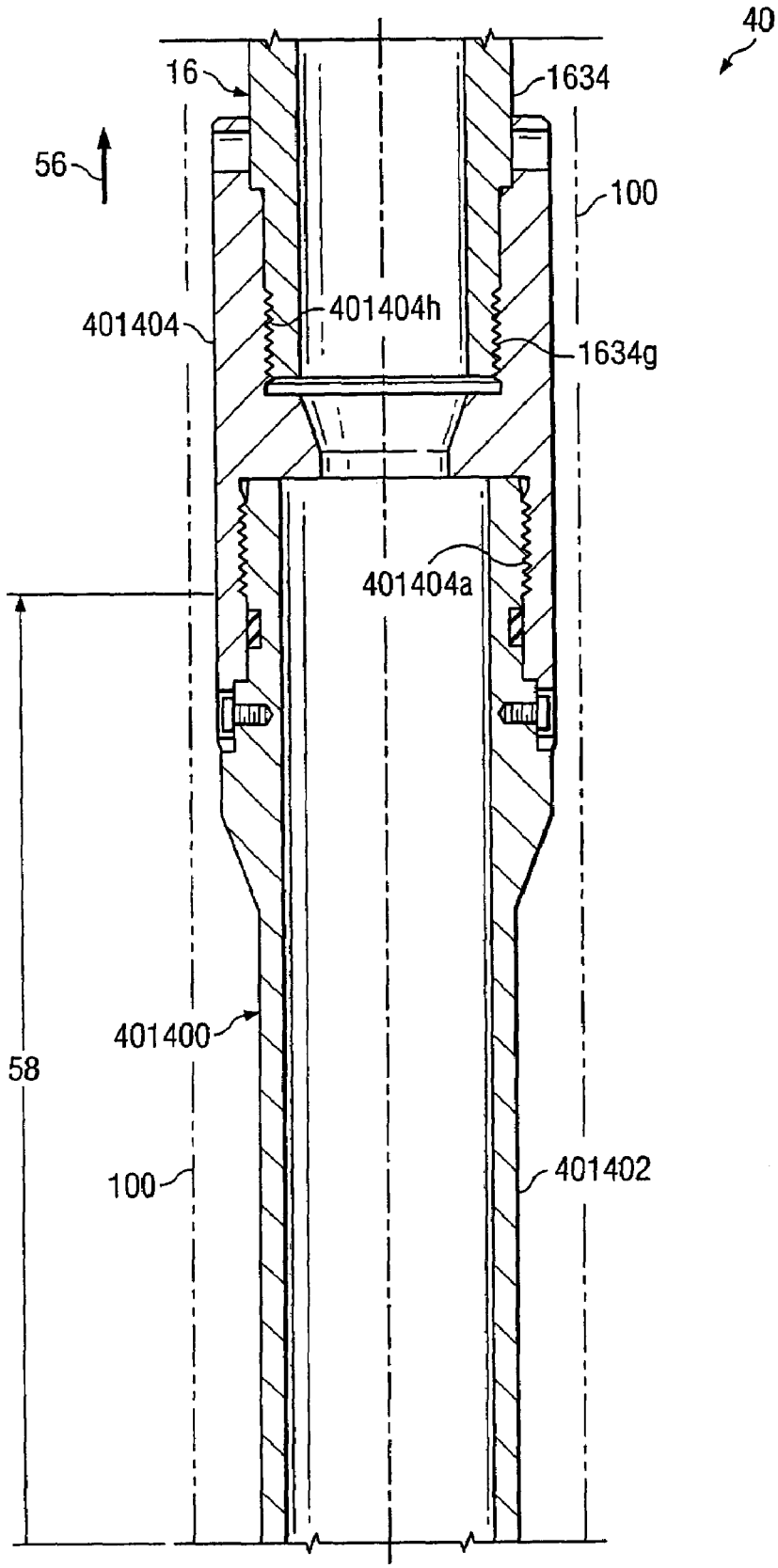
FIGS. 39A to 39T, 40A to 40T and 41A to 41X, are fragmentary cross-sectional illustrations of an exemplary embodiment of the operation of the tension actuator assembly of FIG. 34.
Figure 39B:
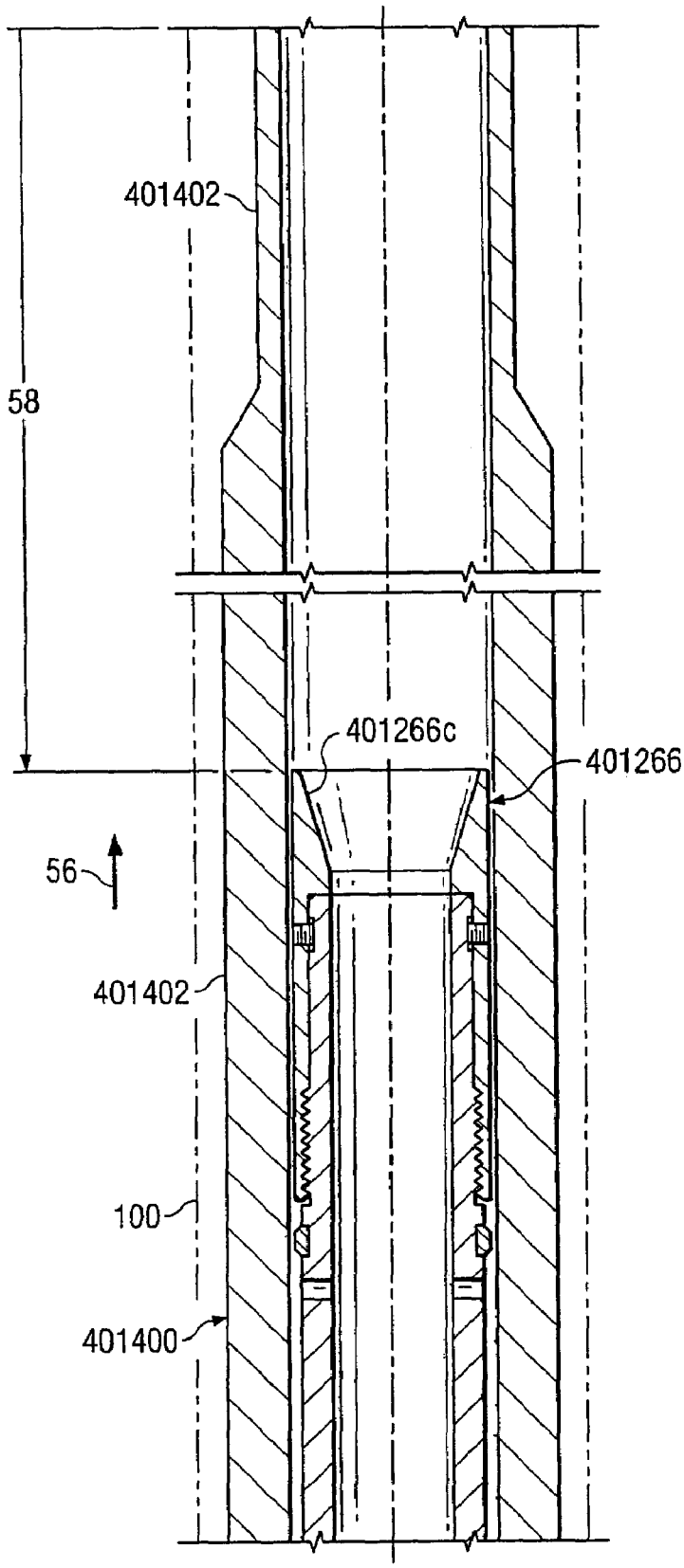
Figure 39C:
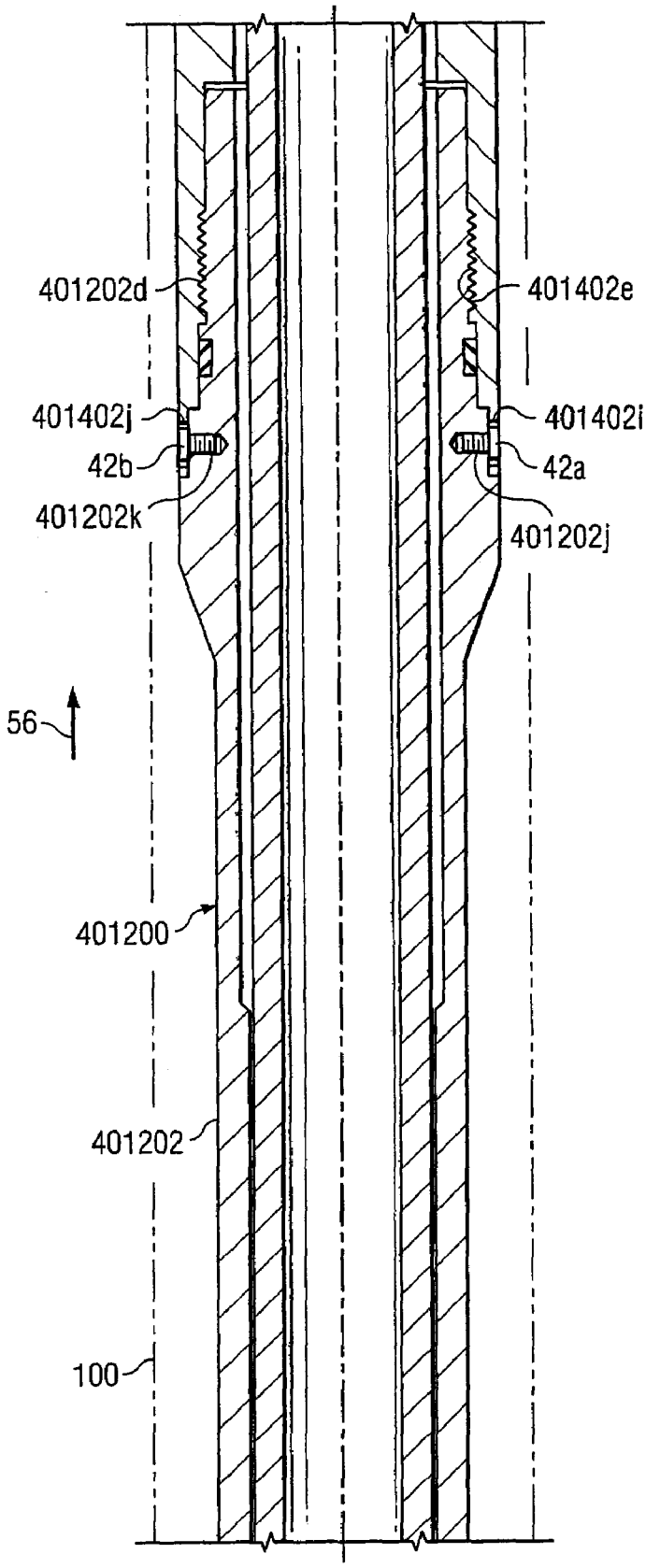
Figure 39D:
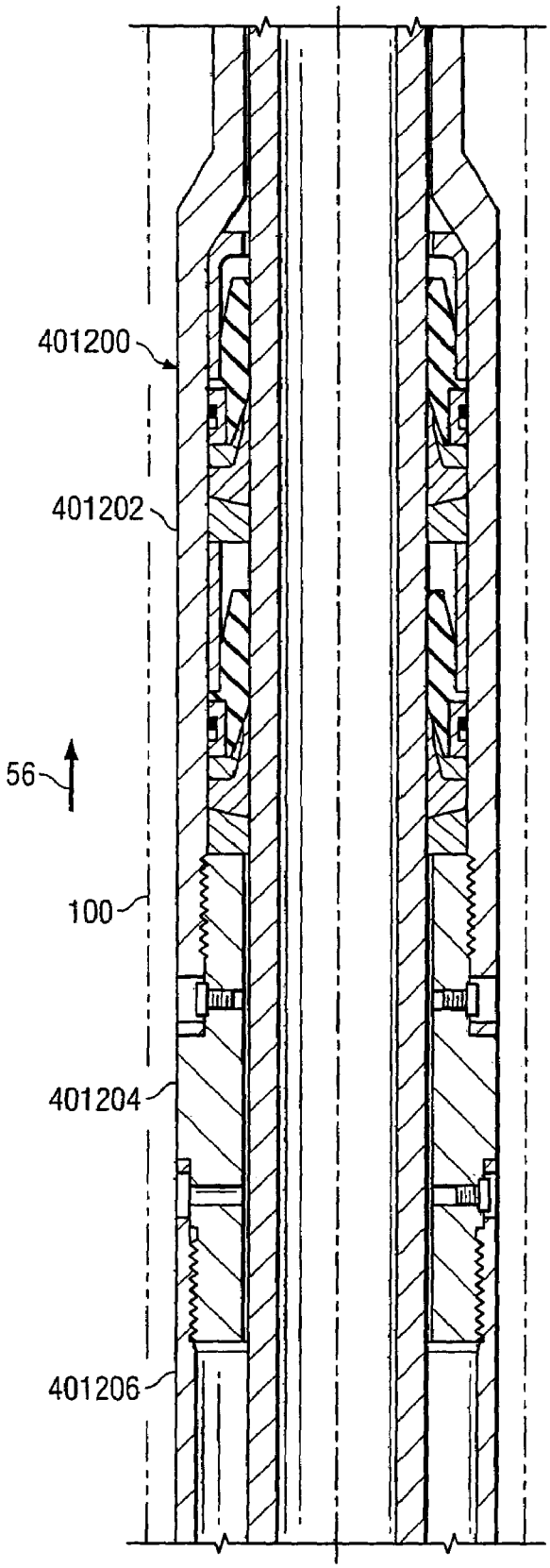
Figure 39E:
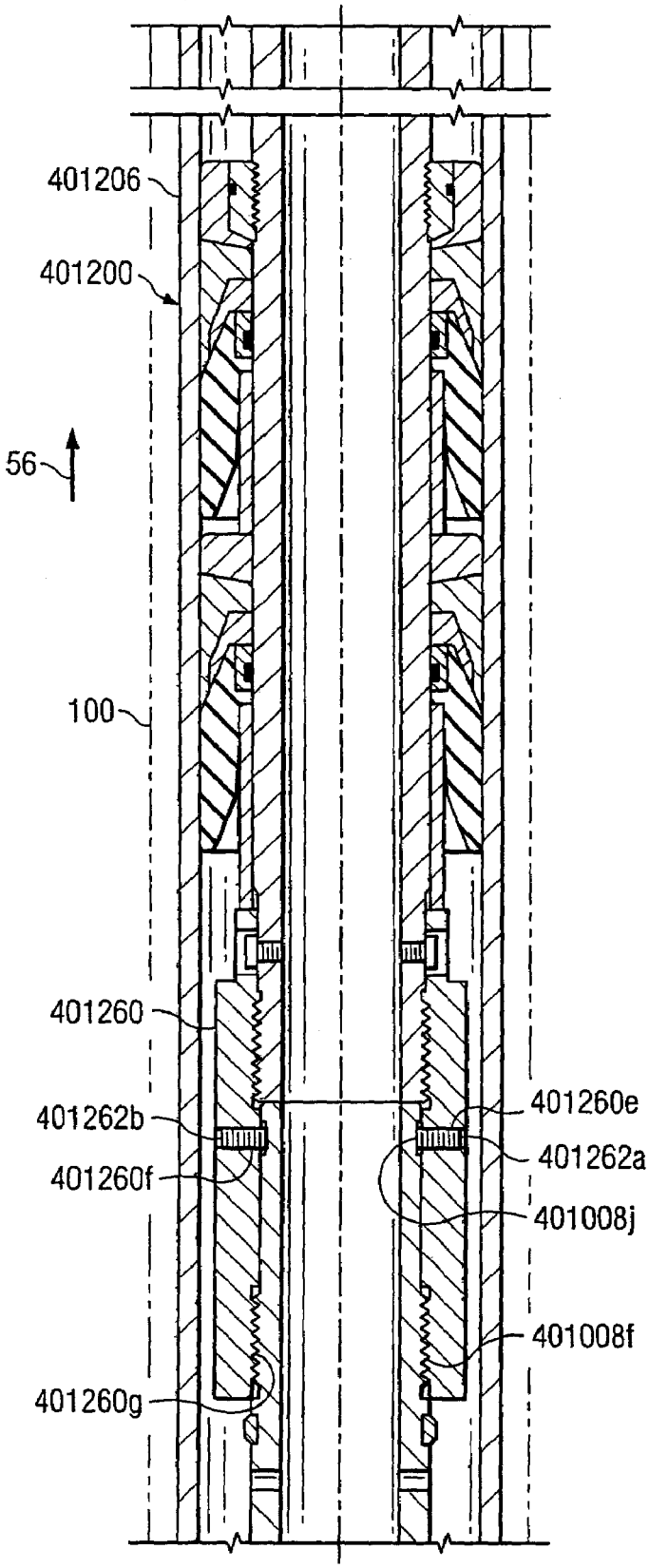
Figure 39F:
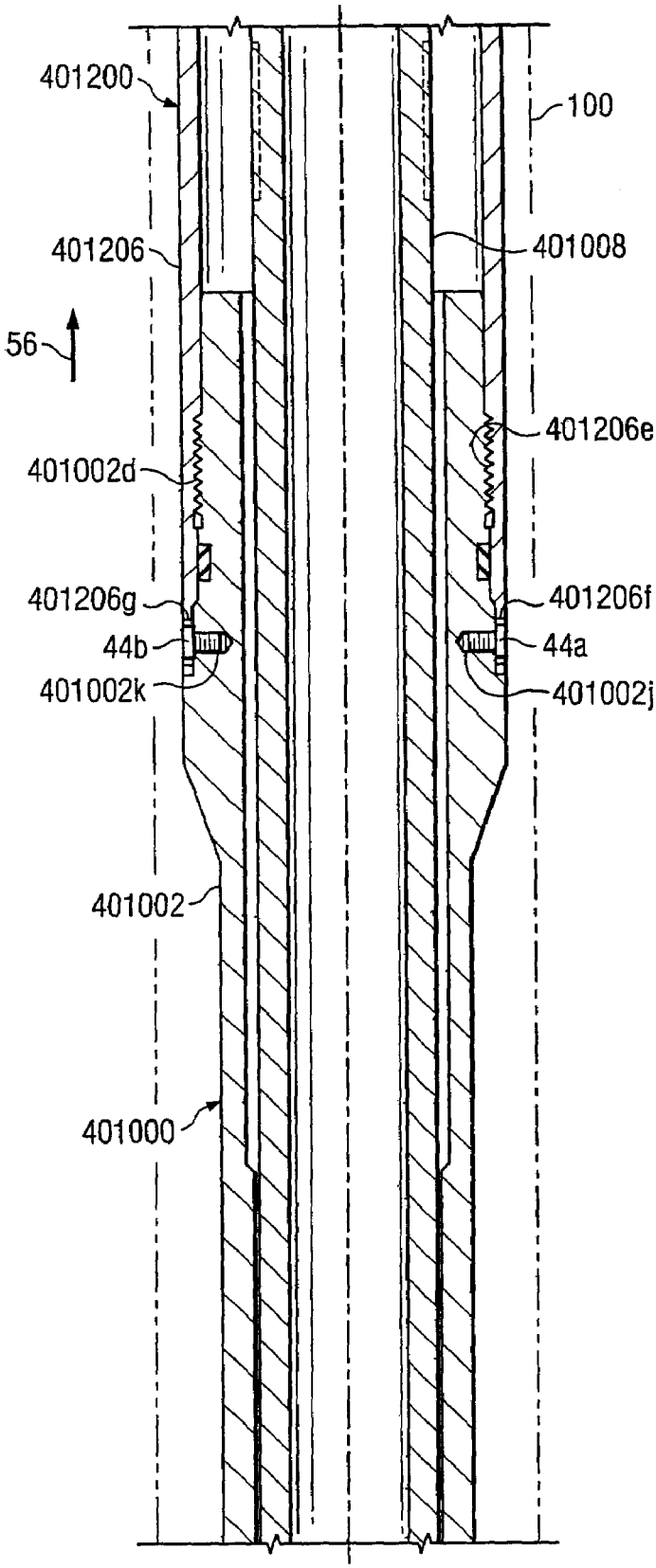
Figure 39G:
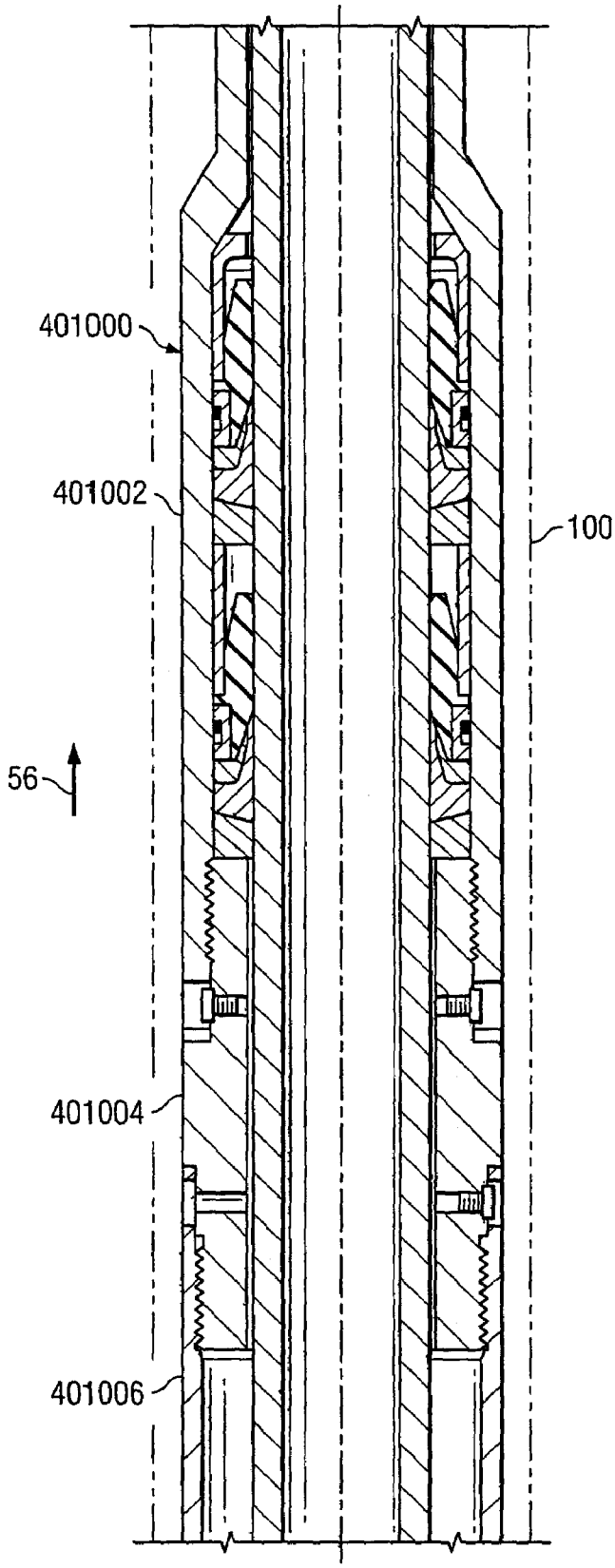
Figure 39H:
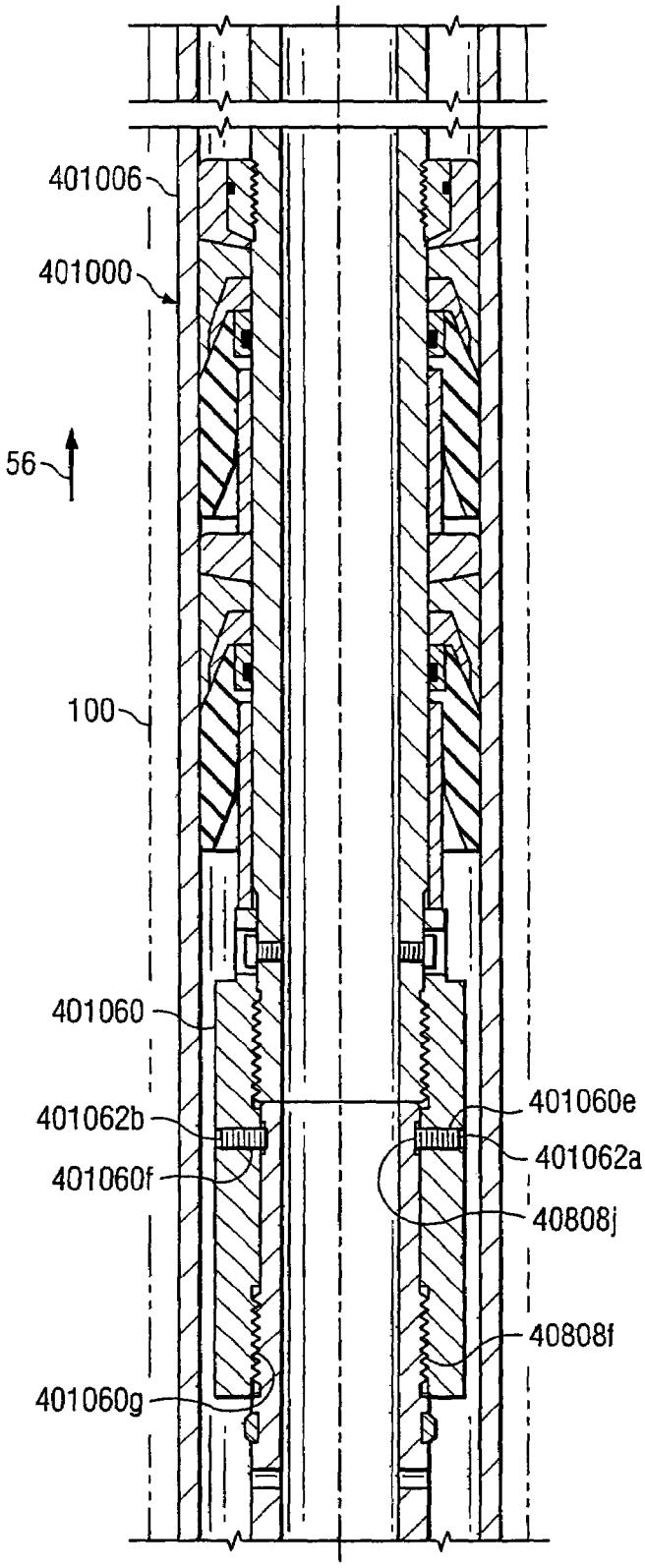
Figure 39I:
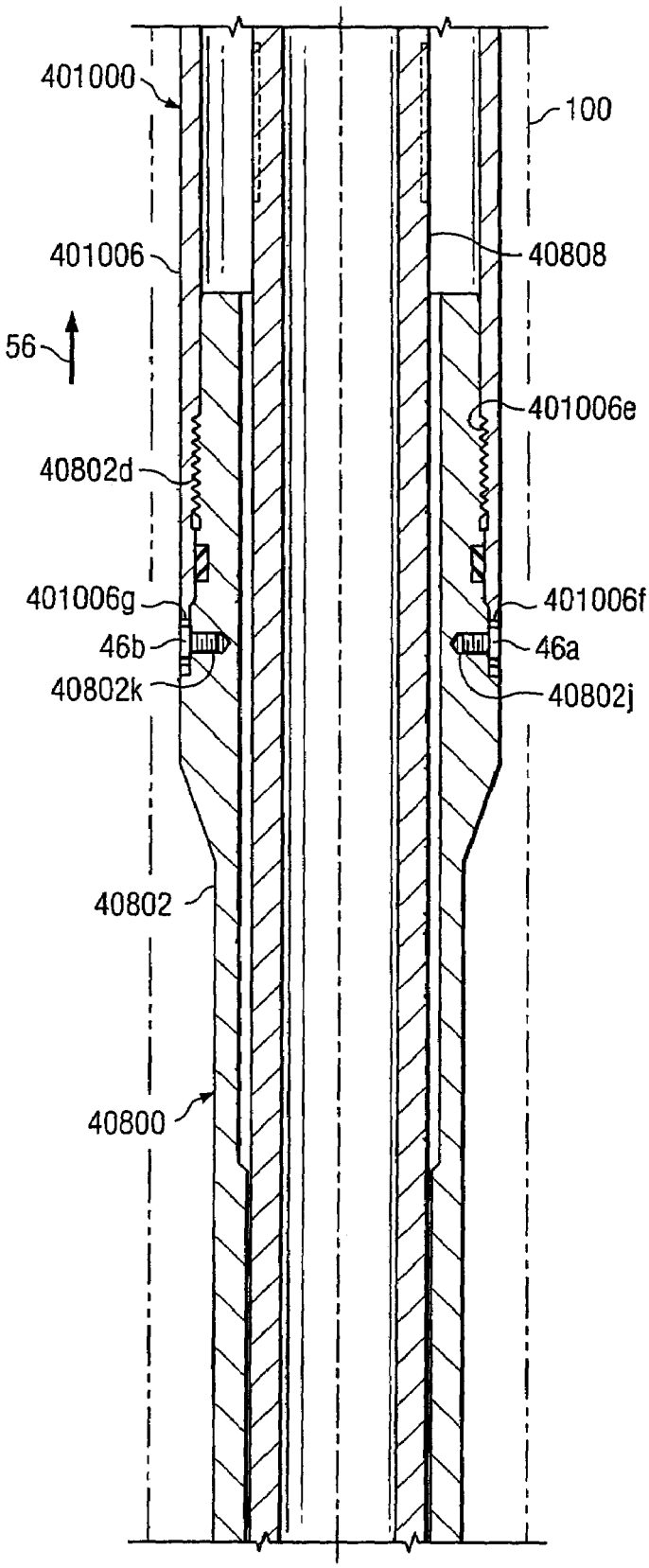
Figure 39J:
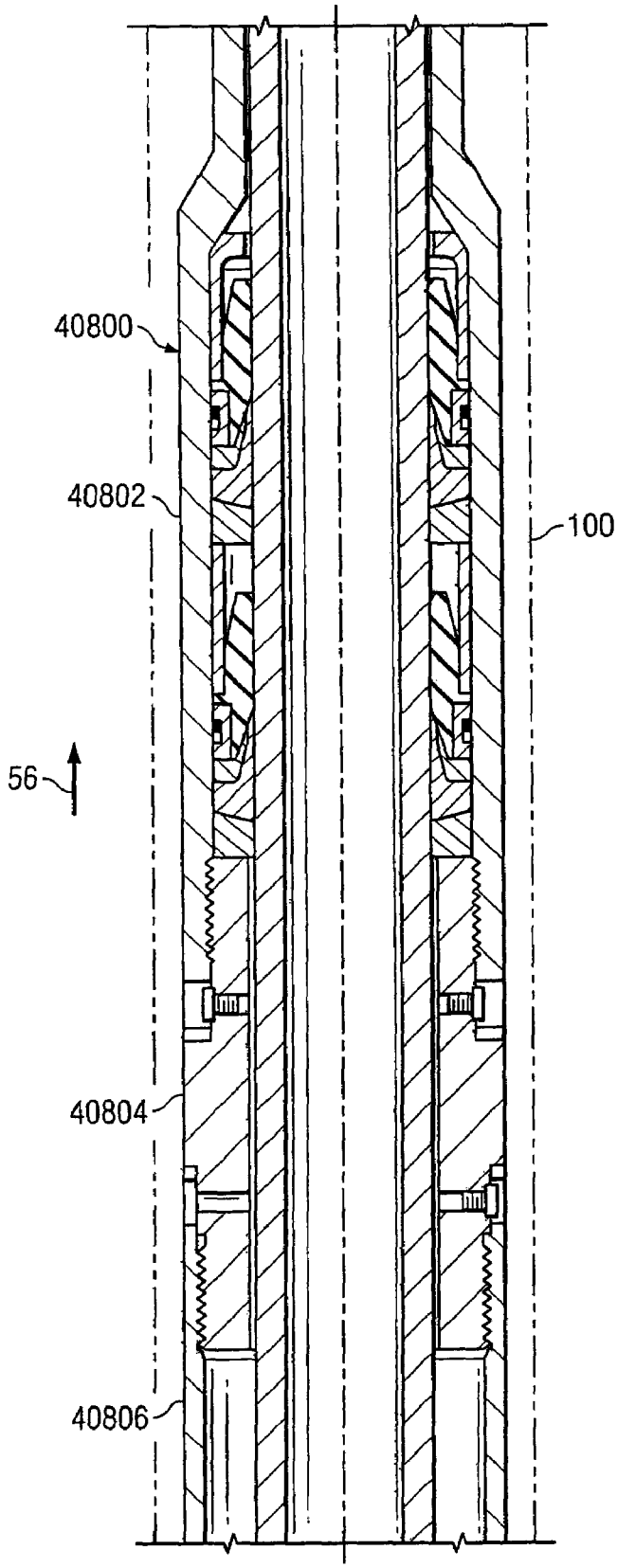
Figure 39K:
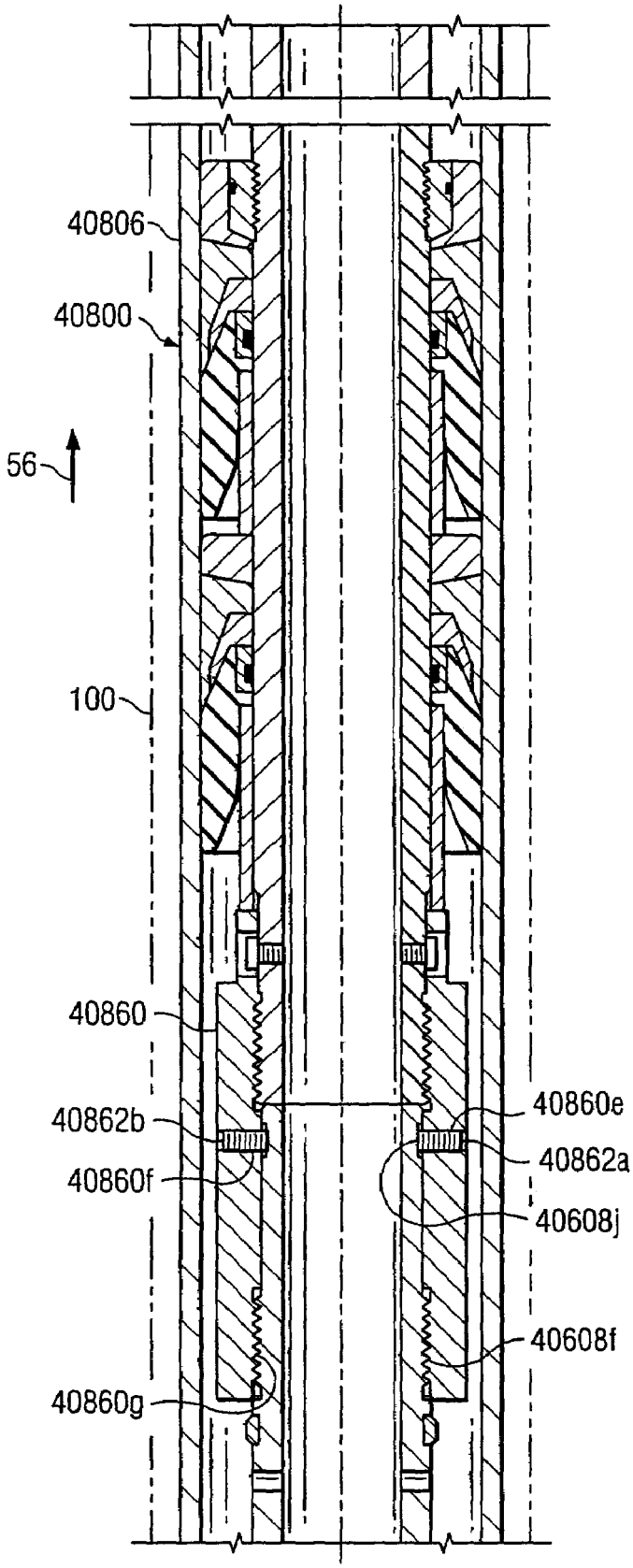
Figure 39L:
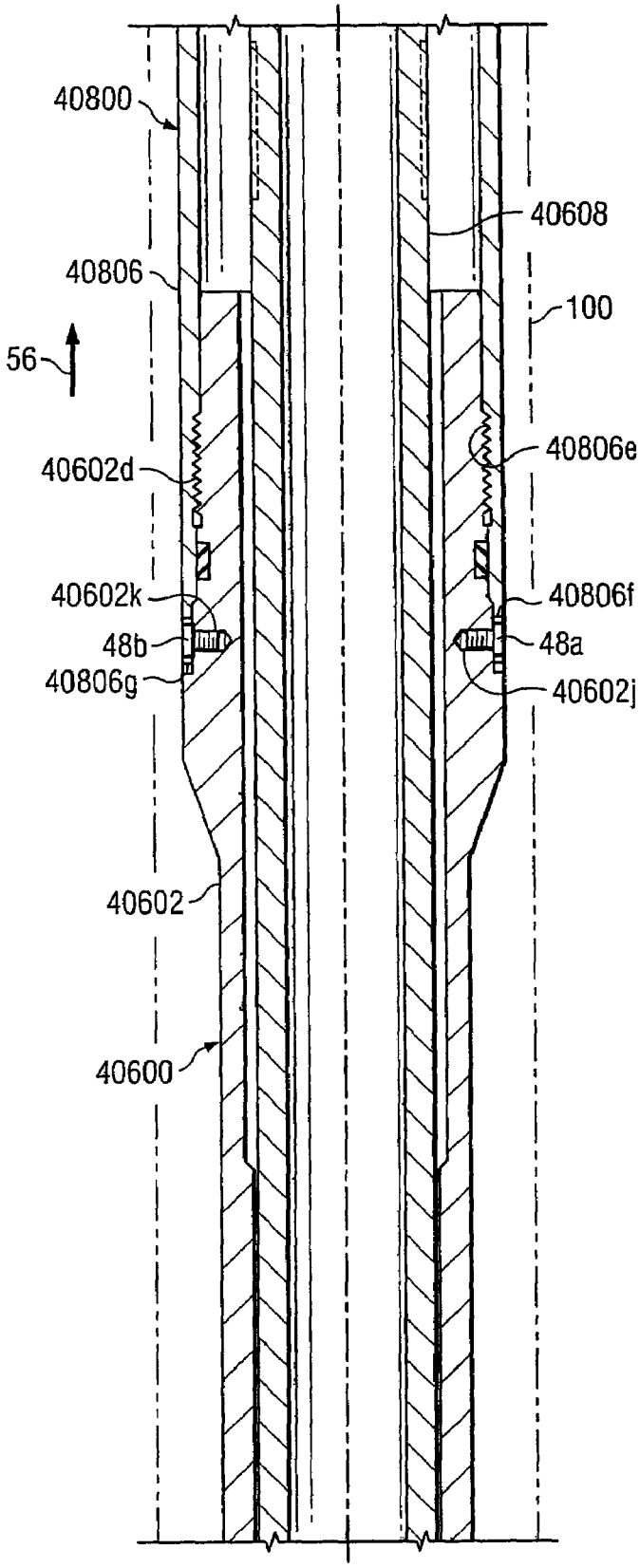
Figure 39M:
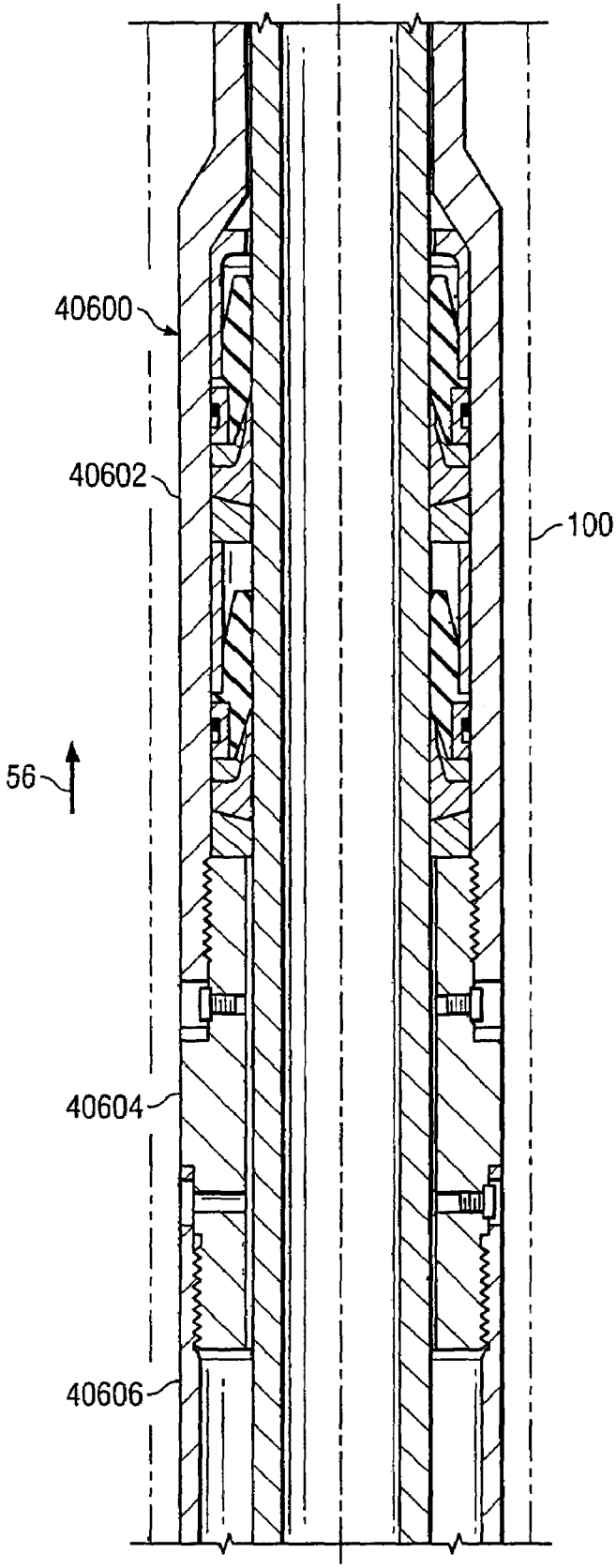
Figure 39N:
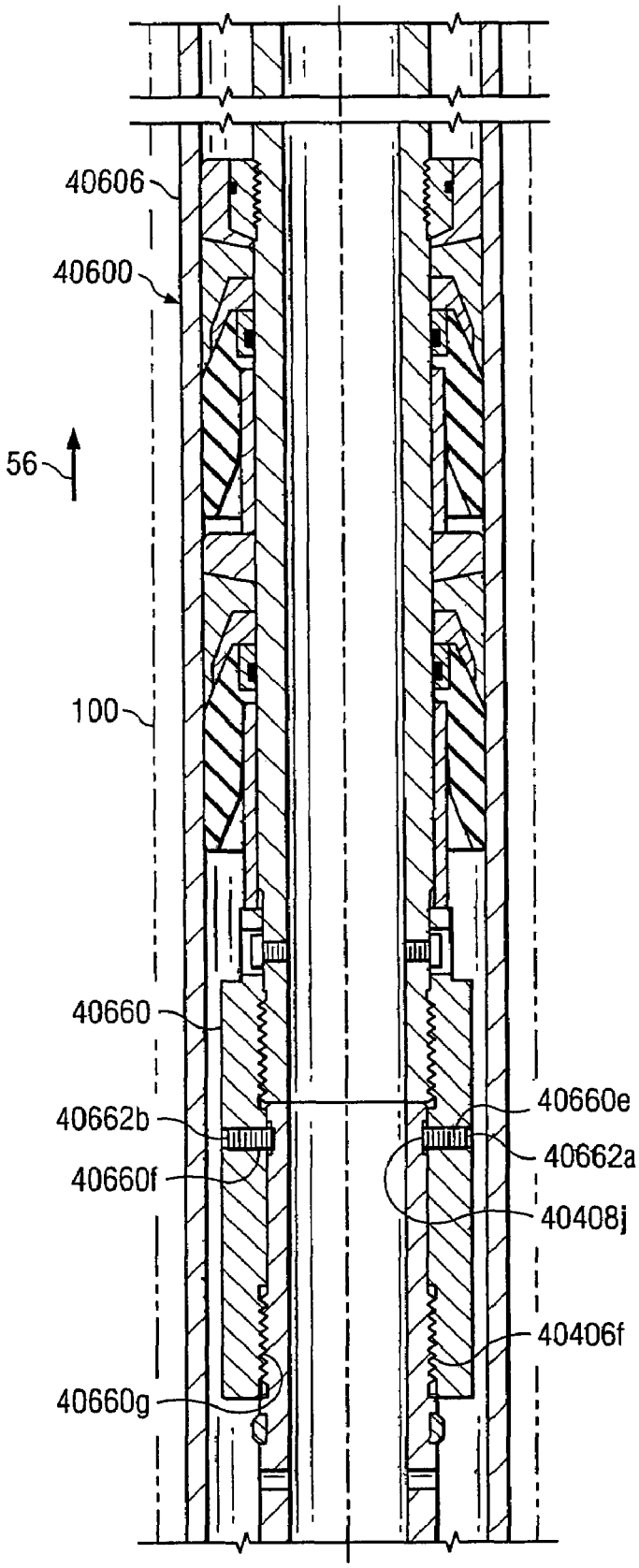
Figure 39O:
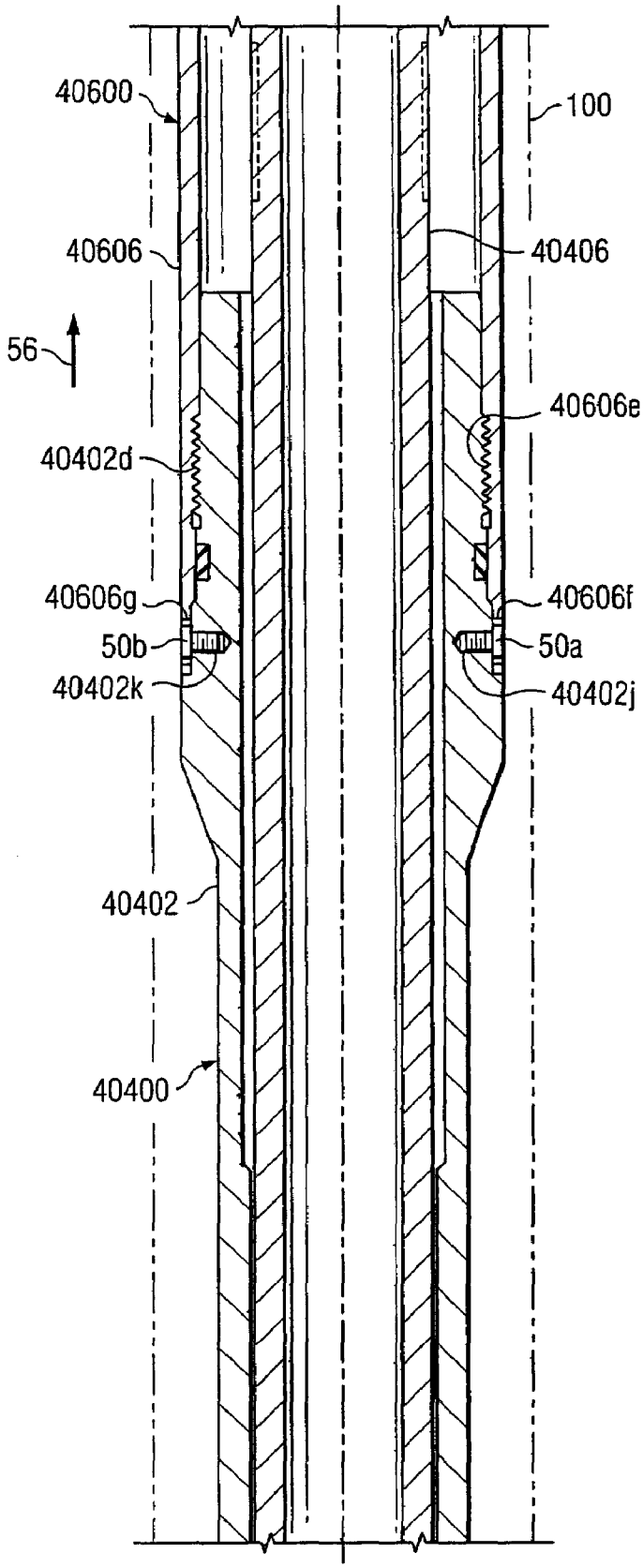
Figure 39P:
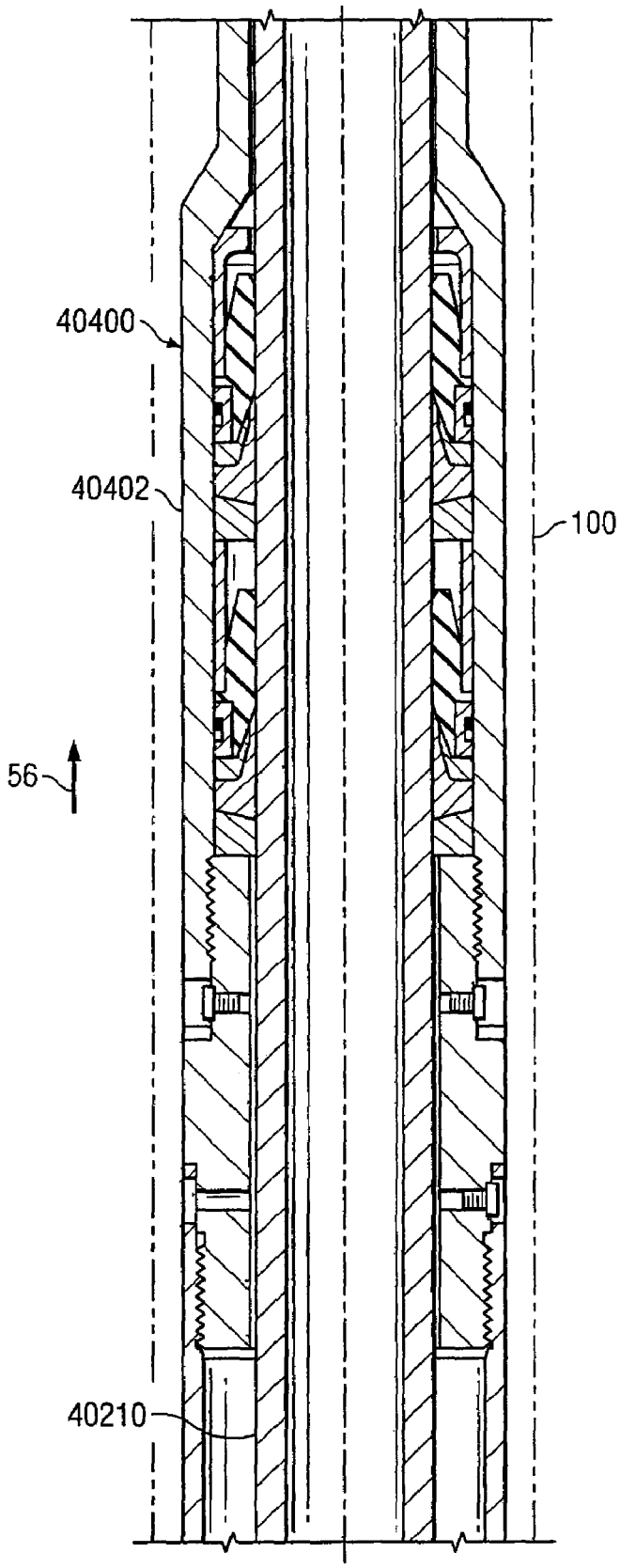
Figure 39Q:
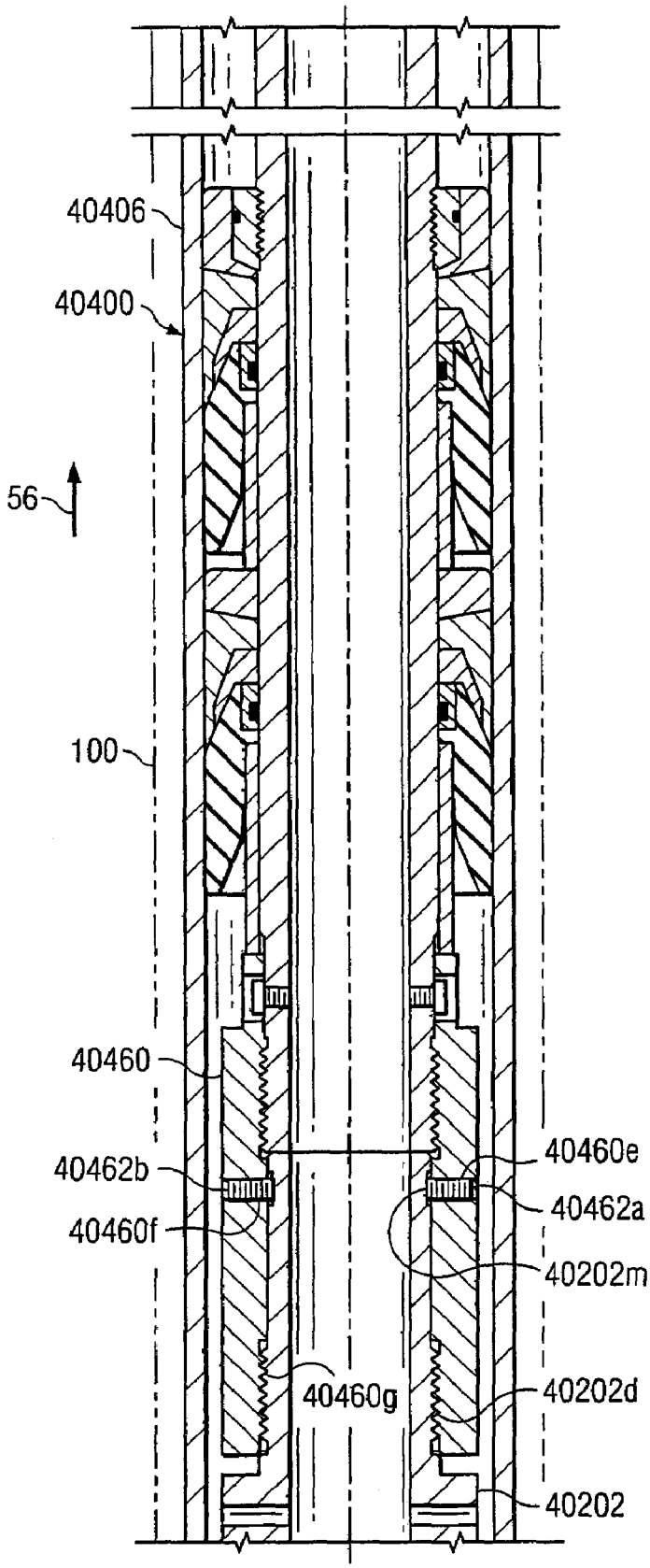
Figure 39R:
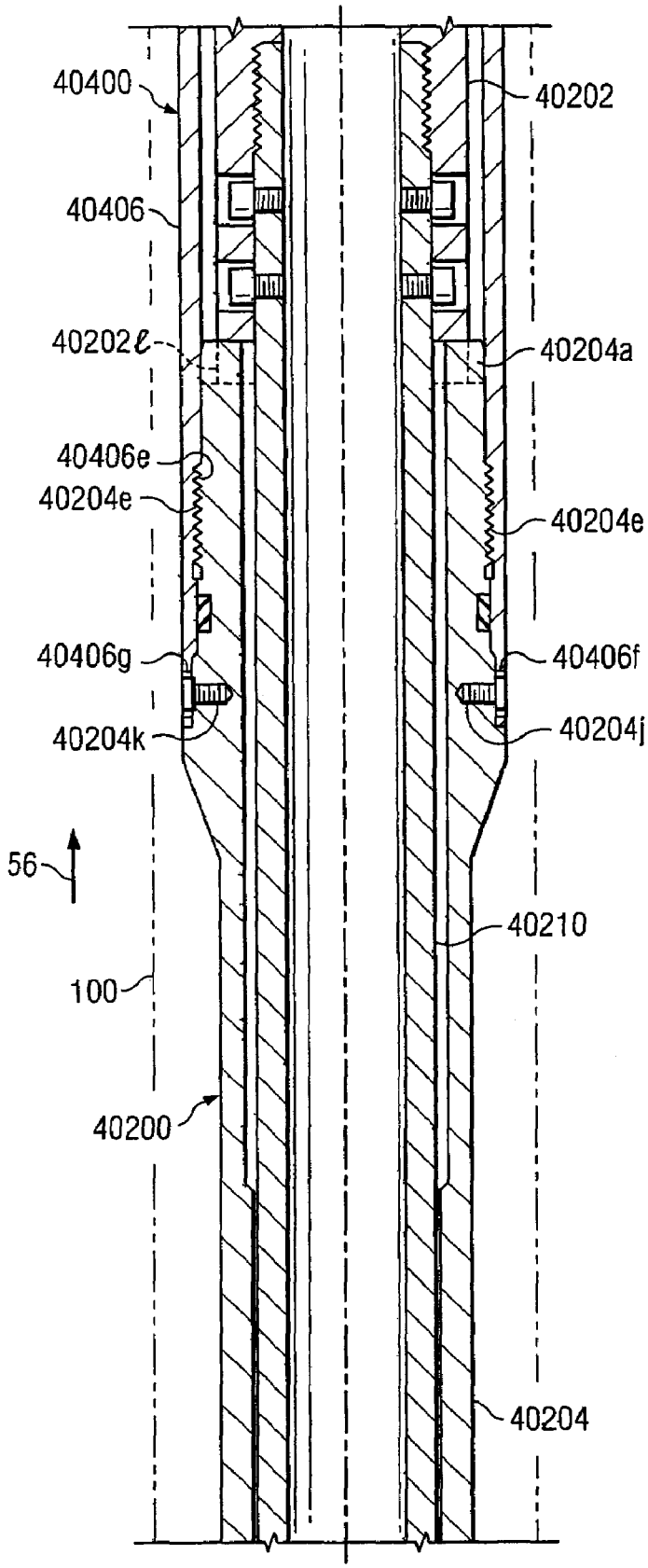
Figure 39S:
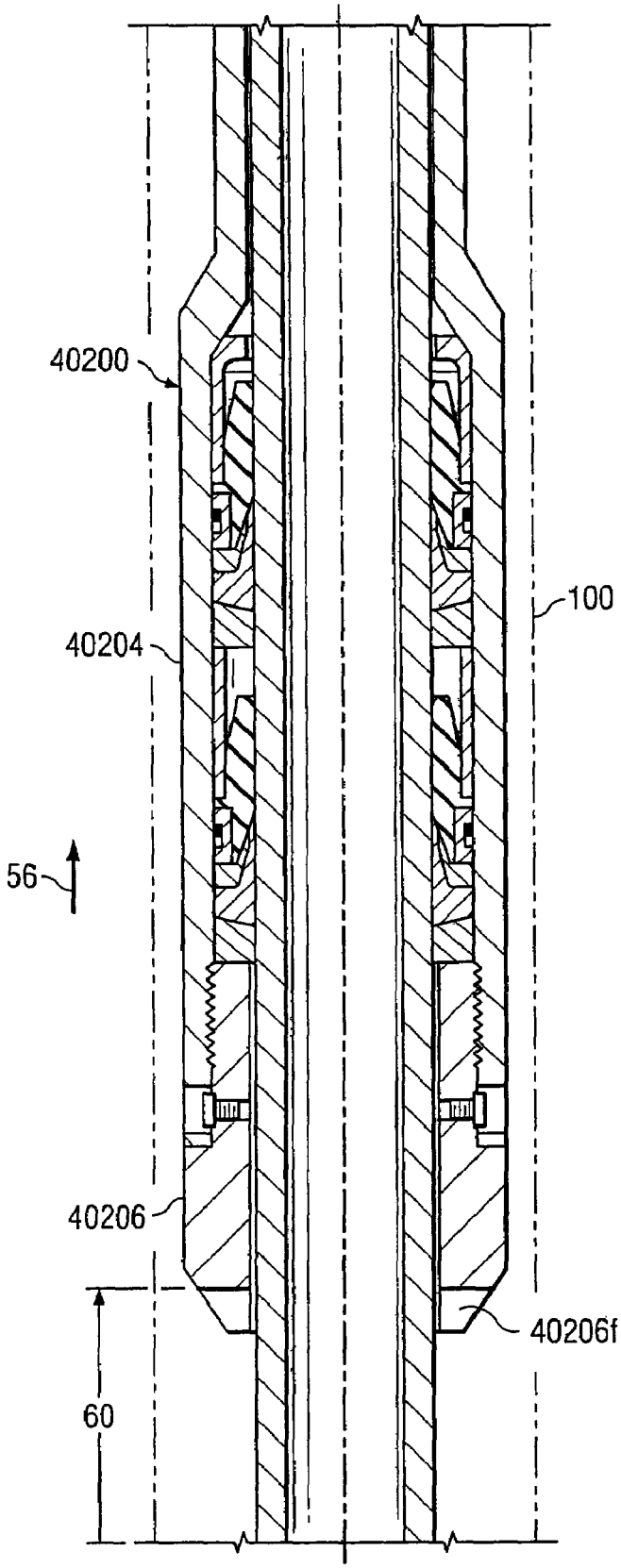
Figure 39T:
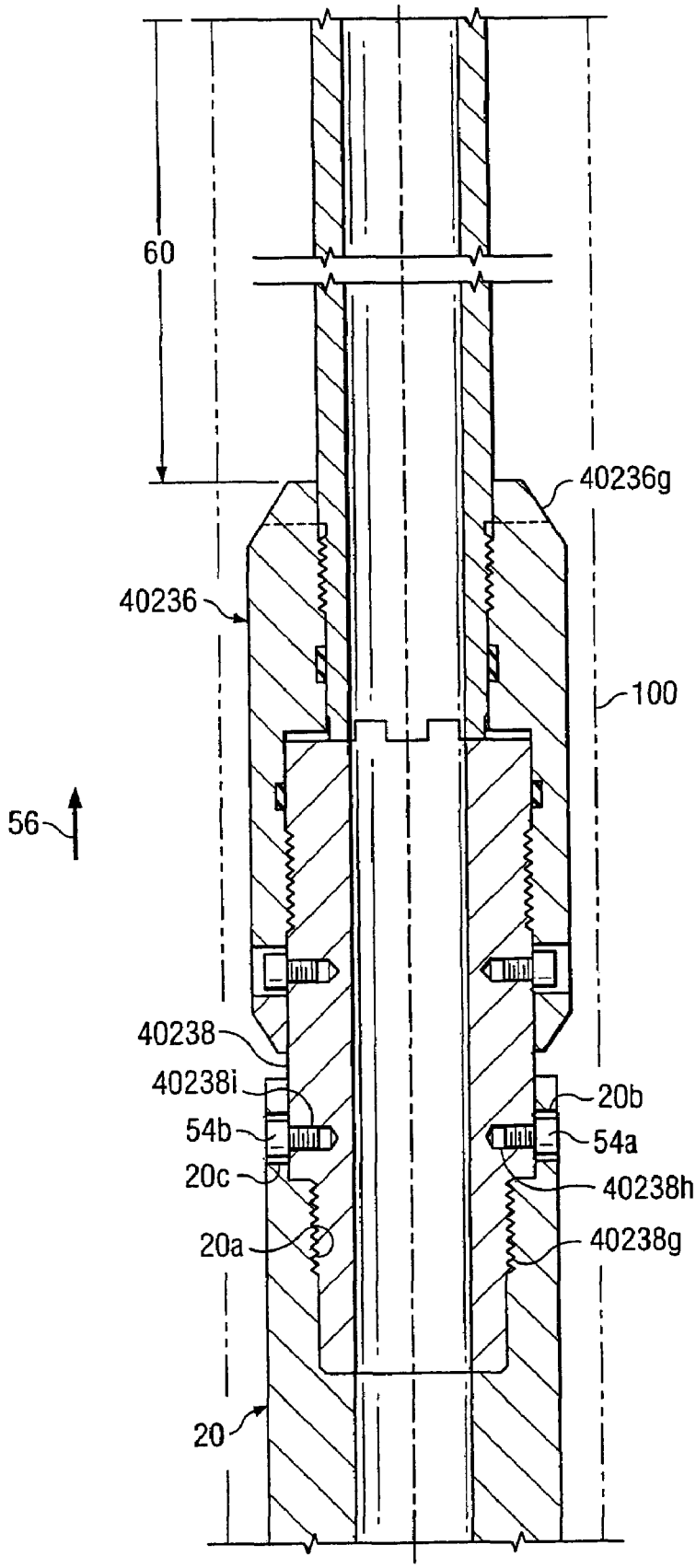

In an exemplary embodiment, as illustrated in FIGS. 39A through 39T, the internal threaded connection 401404*h* of the coupling 401404 of the top subassembly 401400 receives and is coupled to the external threaded connection 1634*g* of the lower mandrel 1634 of the ball grabber assembly 16. The internal threaded connection 401402*e* of the top barrel 401402 of the top subassembly 401400 receives and is coupled to the external threaded connection 401202*d* of the upper subassembly 401200 so that the openings, 401402*i* and 401402*j*, are generally aligned with the openings, 401202*j* and 401202*k*, respectively. A torque pin 42*a* extends through the openings 401402*i* and 401202*j*, and a torque pin 42*b* extends through the openings 401402*j* and 401202*k*, to lock the top subassembly 401400 to the upper subassembly 401200.

The internal threaded connection 401260*g* of the collar 401260 of the upper subassembly 401200 receives and is coupled to the external threaded connection 401008*f* of the connecting rod 401008 of the middle subassembly 401000. The set screws, 401262*a* and 401262*b*, extend through the openings, 401260*e* and 401260*f*, respectively, and into the external annular recess 401008*j* to lock the collar 401260 to the connecting rod 401008. The internal threaded connection 401206*e* of the barrel 401206 of the upper subassembly 401200 receives and is coupled to the external threaded connection 401002*d* of the middle lift adapter 401002 of the middle subassembly 401000 so that the openings, 401206*f* and 401206*g*, are generally axially aligned with the openings, 401002*j* and 401002*k*, respectively. A torque pin 44*a* extends through the openings 401206*f* and 401002*j*, and a torque pin 44*b* extends through the openings 401206*g* and 401002*k*, to lock the barrel 401206 to the middle lift adapter 401002.

The internal threaded connection 401060*g* of the coupling 401060 of the middle subassembly 401000 receives and is coupled to the external threaded connection 40808*f* of the connecting rod 40808 of the middle subassembly 40800. The set screws, 401062*a* and 401062*b*, extend through the openings, 401060*e* and 401060*f*, respectively, and into the external annular recess 40808*j* to lock the coupling 401060 to the connecting rod 40808. The internal threaded connection 401006*e* of the barrel 401006 of the middle subassembly 401000 receives and is coupled to the external threaded connection 40802*d* of the middle lift adapter 40802 of the middle subassembly 40800 so that the openings, 401006*f* and 401006*g*, are generally axially aligned with the openings, 40802*j* and 40802*k*, respectively. A torque pin 46*a* extends through the openings 401006*f* and 40802*j*, and a torque pin 46*b* extends through the openings 401006*g* and 40802*k*, to lock the barrel 401006 to the middle lift adapter 40802.

The internal threaded connection 40860*g* of the coupling 40860 of the middle subassembly 40800 receives and is coupled to the external threaded connection 40608*f* of the connecting rod 40608 of the middle subassembly 40600. The set screws, 40862*a* and 40862*b*, extend through the openings, 40860*e* and 40860*f*, respectively, and into the external annular recess 40608*j* to lock the coupling 40860 to the connecting rod 40608. The internal threaded connection 40806*e* of the barrel 40806 of the middle subassembly 40800 receives and is coupled to the external threaded connection 40602*d* of the middle lift adapter 40602 of the middle subassembly 40600 so that the openings, 40806*f* and 40806*g*, are generally axially aligned with the openings, 40602*j* and 40602*k*, respectively. A torque pin 48*a* extends through the openings 40806*f* and 40602*j*, and a torque pin 48*b* extends through the openings 40806*g* and 40602*k*, to lock the barrel 40806 to the middle lift adapter 40602.

The internal threaded connection 40660*g* of the coupling 40660 of the middle subassembly 40600 receives and is coupled to the external threaded connection 40406*f* of the connecting rod 40406 of the middle subassembly 40400. The set screws, 40662*a* and 40662*b*, extend through the openings, 40660*e* and 40660*f*, respectively, and into the external annular recess 40406*j* to lock the coupling 40660 to the connecting rod 40406. The internal threaded connection 40606*e* of the barrel 40606 of the middle subassembly 40600 receives and is coupled to the external threaded connection 40402*d* of the middle lift adapter 40402 of the middle subassembly 40400 so that the openings, 40606*f* and 40606*g*, are generally axially aligned with the openings, 40402*j* and 40402*k*, respectively. A torque pin 50*a* extends through the openings 40606*f* and 40402*j*, and a torque pin 50*b* extends through the openings 40606*g* and 40402*k*, to lock the barrel 40606 to the middle lift adapter 40402.

The internal threaded connection 40460*g* of the coupling 40460 of the middle subassembly 40400 receives and is coupled to the external threaded connection 40202*d* of the adapter 40202 of the lower subassembly 40200. The set screws, 40462*a* and 40462*b*, extend through the openings, 40460*e* and 40460*f*, respectively, and into the external annular recess 40202*m* to lock the coupling 40460 to the adapter 40202. The internal threaded connection 40406*e* of the barrel 40406 of the middle subassembly 40400 receives and is coupled to the external threaded connection 40204*e* of the lower lift adapter 40204 of the lower subassembly 40200 so that the openings, 40406*f* and 40406*g*, are generally axially aligned with the openings, 40204*j* and 40204*k*, respectively. A torque pin 52*a* extends through the openings 40406*f* and 40204*j*, and a torque pin 52*b* extends through the openings 40406*g* and 40204*k*, to lock the barrel 40406 to the lower lift adapter 40204.

The external threaded connection 40238*g* of the lower nipple 40238 of the lower subassembly 40200 is received within and coupled to the internal threaded connection 20*a* of the end of the safety sub assembly 20 so that the openings, 40238*h* and 40238*i*, of the lower nipple 40238 are generally aligned with openings, 20*b* and 20*c*, of the safety sub assembly 20. A torque pin 54*a* extends through the openings 40238*h* and 20*b*, and a torque pin 54*b* extends through the openings 40238*i* and 20*c*, to lock the lower nipple 40238 to the safety sub assembly 20.

In several exemplary embodiments, one or more of the elements of the system 10 coupled to and positioned below the lower nipple 40238 may be removed from the system 10, or may be repositioned relative to one or more other elements of the system 10. For example, the safety sub assembly 20, the sealing cup assembly 22, the casing lock assembly 24 and the extension actuator assembly 26 may be removed from the system 10 so that the lower nipple 40238 of the lower subassembly 40200 of the tension actuator assembly 40 is directly coupled, rather than indirectly coupled, to the expansion cone assembly 28. For another example, the safety sub assembly 20, the sealing cup assembly 22, the casing lock assembly 24, the extension actuator assembly 26 and the expansion cone assembly 28 may be removed from the system 10 so that the lower nipple 40238 of the lower subassembly 40200 of the tension actuator assembly 40 is directly coupled, rather than indirectly coupled, to the expansion cone assembly 30.

In several exemplary embodiments, one or more of the above-described elements of the tension actuator assembly 40 may be omitted, at least in part, and/or combined, at least in part, with one or more other elements, or sub-elements thereof, of the tension actuator assembly 40 and/or the system 10.

In an exemplary embodiment, as illustrated in FIGS. 39*a* through 39T, during operation of the tension actuator assembly 40, the tension actuator assembly is positioned within the casing 100. The tension actuator assembly 40 is initially placed in an extended configuration by pulling the expansion cone assembly 28 and/or the expansion cone assembly 30 against the inside surface of the casing 100 and/or against the end of the casing 100. More particularly, the tubular support member 12 is moved upwardly in a direction 56, causing the cutter assembly 14 and the ball gripper assembly 16 to also move upwardly in the direction 56, and causing the top subassembly 401400, the upper lift adapter 401202 of the upper subassembly 401200, the middle lift adapters 401002, 40802, 40602 and 40402 of the middle subassemblies 401000, 40800, 40600 and 40400, respectively, the retainers 401004, 40804, 40604 and 40404 of the middle subassemblies 401000, 40800, 40600 and 40400, respectively, the barrels 401006, 40806, 40606 and 40406 of the middle subassemblies 401000, 40800, 40600 and 40400, respectively, and the lower lift adapter 40204 and the torque retainer 40206 of the lower subassembly 40200 to also move upwardly in the direction 56. As a result, the torque lugs 40204*a* of the lower lift adapter 40204 of the lower subassembly 40200 engage and mesh with torque lugs 40202*l* of the adapter 40202 of the lower subassembly. As a result of the engagement and meshing of the torque lugs 40204*a* with the torque lugs 40202*l*, the continued movement of the tubular support 12 in the direction 56 causes all of the elements of the lower subassembly 40200, the middle subassemblies 40400, 40600, 40800 and 401000, the upper subassembly 401200, and the top subassembly 401400, to move upwardly in the direction 56 until the expansion cone assembly 28 and/or the expansion cone assembly 30 is pulled against the inside surface of the casing 100 and/or against the end of the casing 100. As a result, the tension actuator assembly 40 is in an extended configuration.

When the tension actuator assembly 40 is in its extended configuration, an axial distance 58 is defined between the end of the internal tapered surface 401266*c* of the guide 401266 of the upper subassembly 401200 and the internal threaded connection 401404*a* of the coupling 401404 of the top subassembly 401400, and an axial distance 60 is defined between the torque lugs 40206*f* of the torque retainer 40206 of the lower subassembly 40200 and the torque lugs 40236*g* of the coupling 40236 of the lower subassembly 40200. In an exemplary embodiment, the distances, 58 and 60, may be about equal to one another.

When the tension actuator assembly 40 is in its extended configuration, the engagement and meshing of the torque lugs 40204*a* with the torque lugs 40202*l* permits torque to be transmitted through the tension actuator assembly 40. For example, torque may be applied to the top subassembly 401400, thereby transmitting torque through the upper lift adapter 401202, the retainer 401204 and the barrel 401206 of the upper subassembly 401200; the middle lift adapters 401002, 40802, 40602 and 40402 of the middle subassemblies 401000, 40800, 40600 and 40400, respectively; the retainers 401004, 40804, 40604 and 40404 of the middle subassemblies 401000, 40800, 40600 and 40400, respectively; the barrels 401006, 40806, 40606 and 40406 of the middle subassemblies 401000, 40800, 40600 and 40400, respectively; and the lower lift adapter 40204 of the lower subassembly 40200, due to the above-described couplings between these elements, and the torque is transmitted from the lower lift adapter 40204 to the lower connecting rod 40210 via the engagement and meshing of the torque lugs 40204*a* with the torque lugs 40202*l* and the above-described coupling of the adapter 40202 with the lower connecting rod 40210. As a result, the torque is transmitted from the lower connecting rod 40210 to one or more of the elements of the system 10 coupled to and positioned below the lower nipple 40238 via the above-described coupling between the lower connecting rod 40210 and the coupling 40236, and the coupling between the coupling 40236 and the lower nipple 40238.

In an exemplary embodiment, the ball gripper assembly 16 is operated to engage and hold the position of the casing 100, relative to the tubular support member 12, in a manner of operation substantially similar to any one of the manners of operation described and/or referenced above, and/or any combination thereof.

Figure 40A:
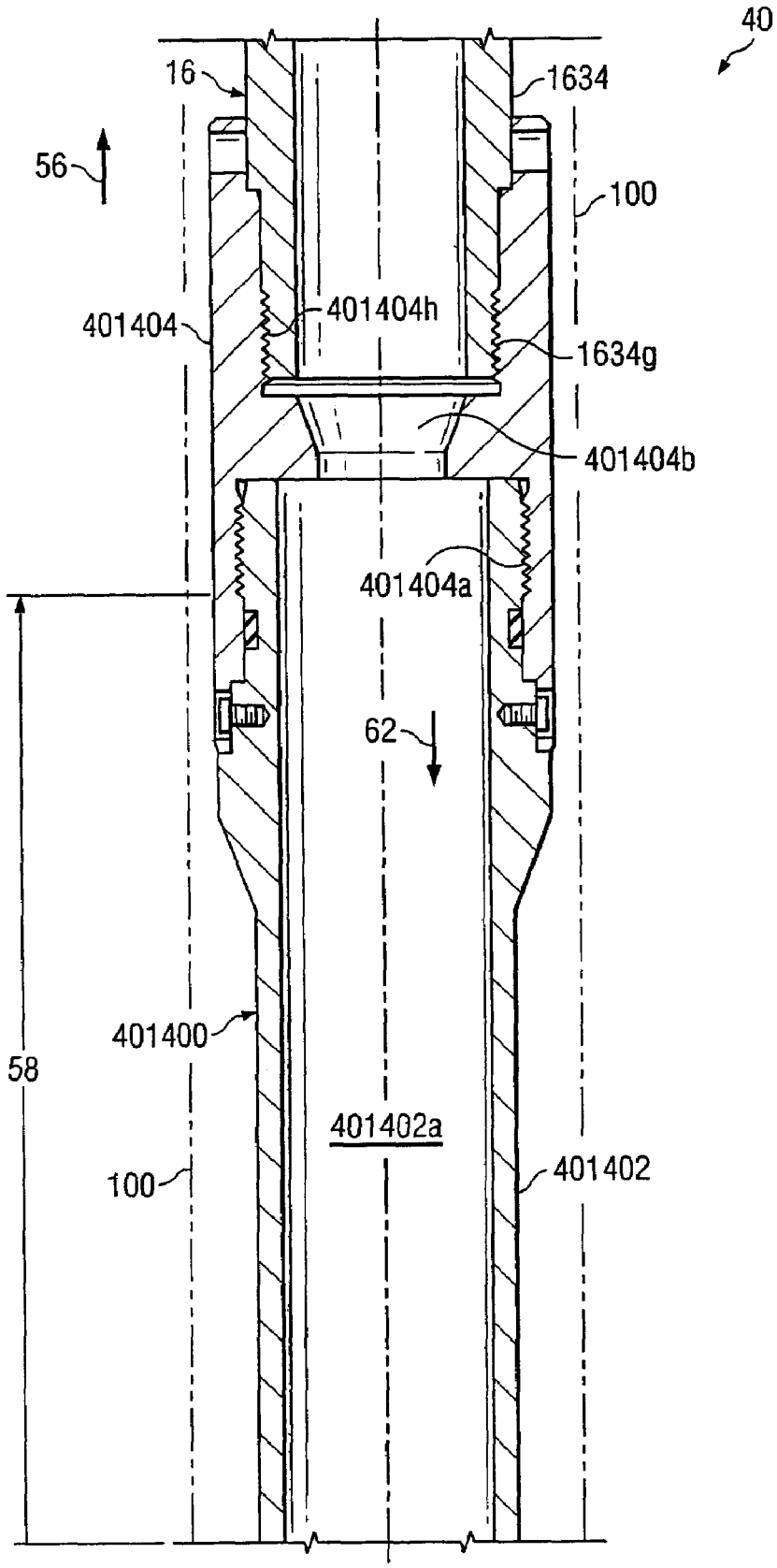
Figure 40B:
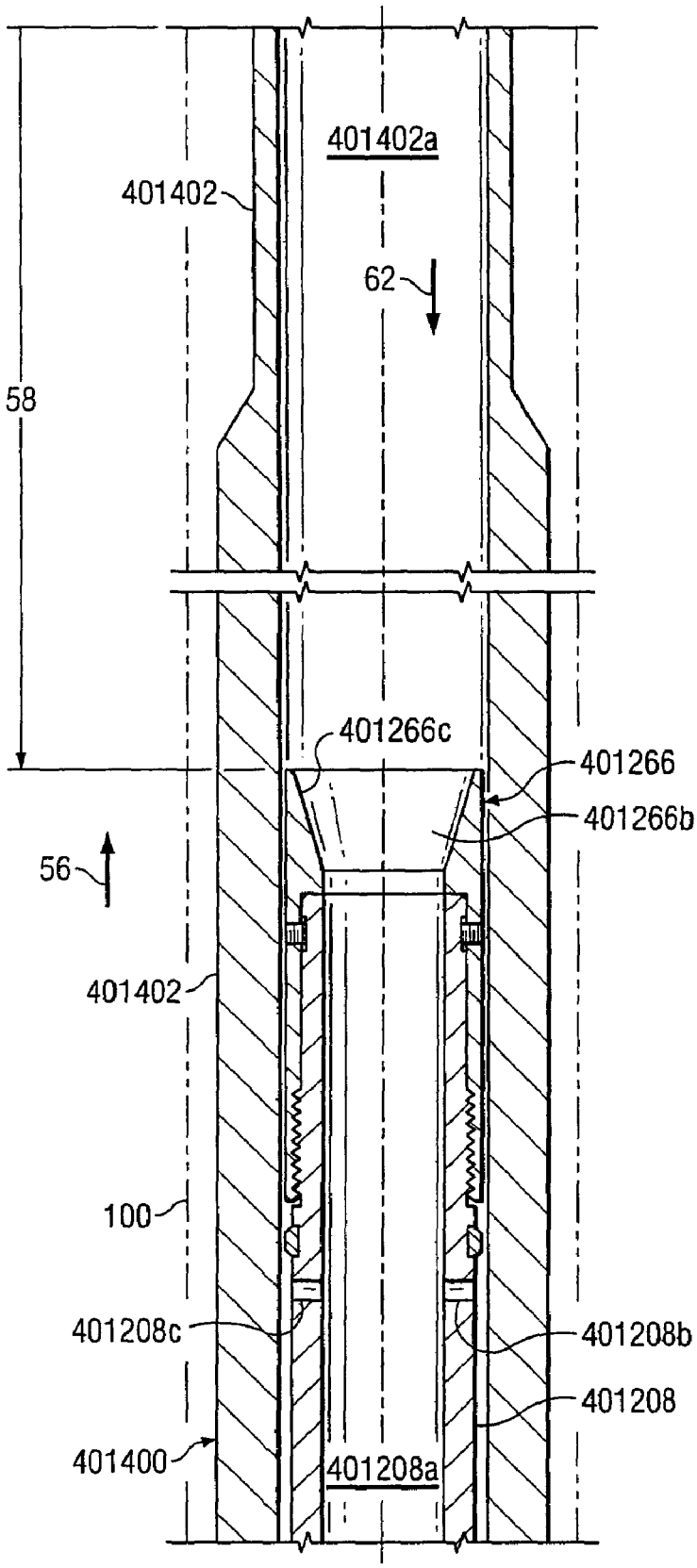
Figure 40C:
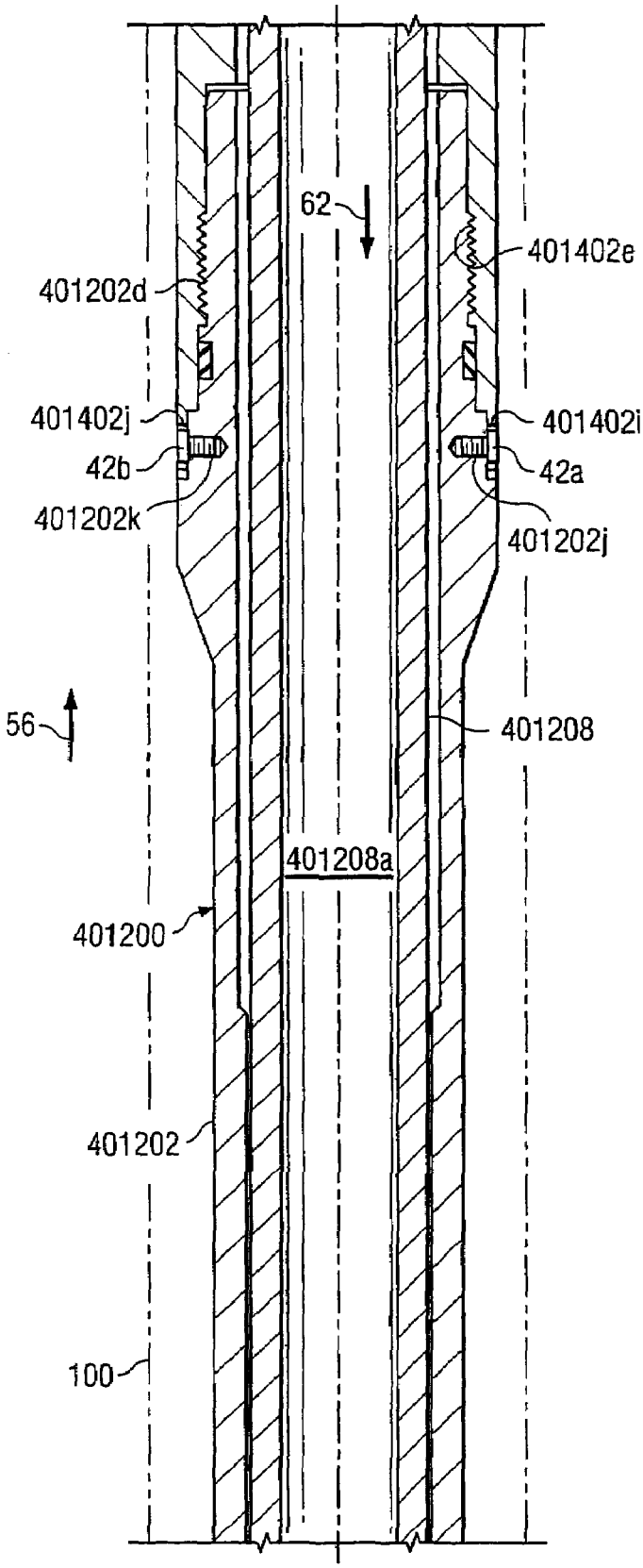
Figure 40D:
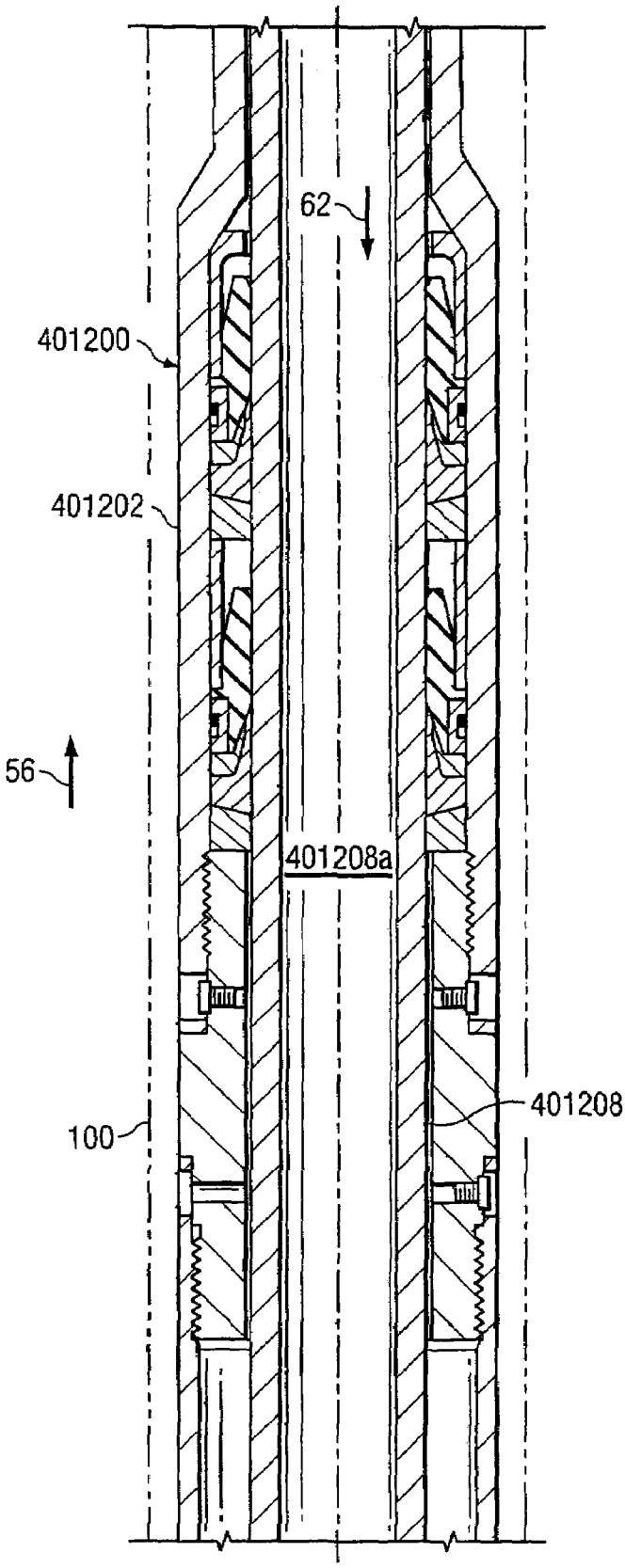
Figure 40E:
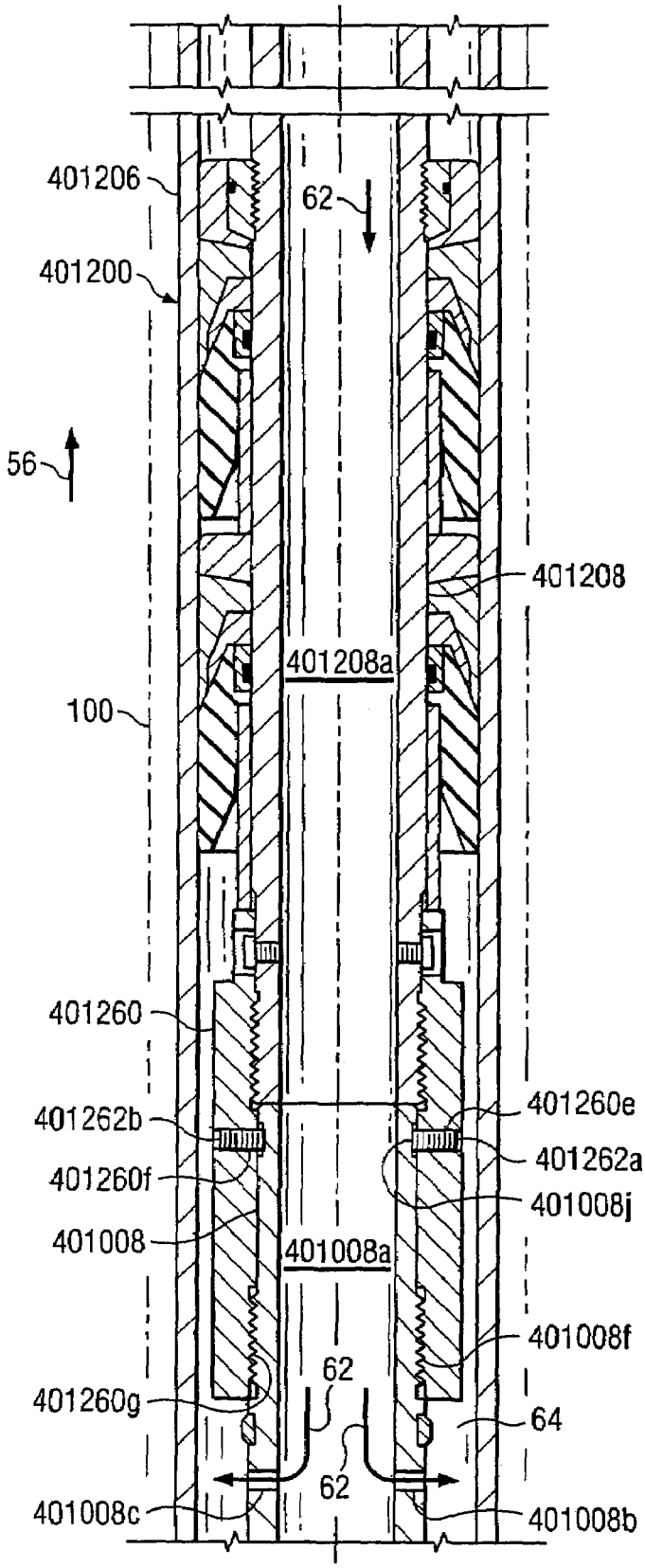
Figure 40F:
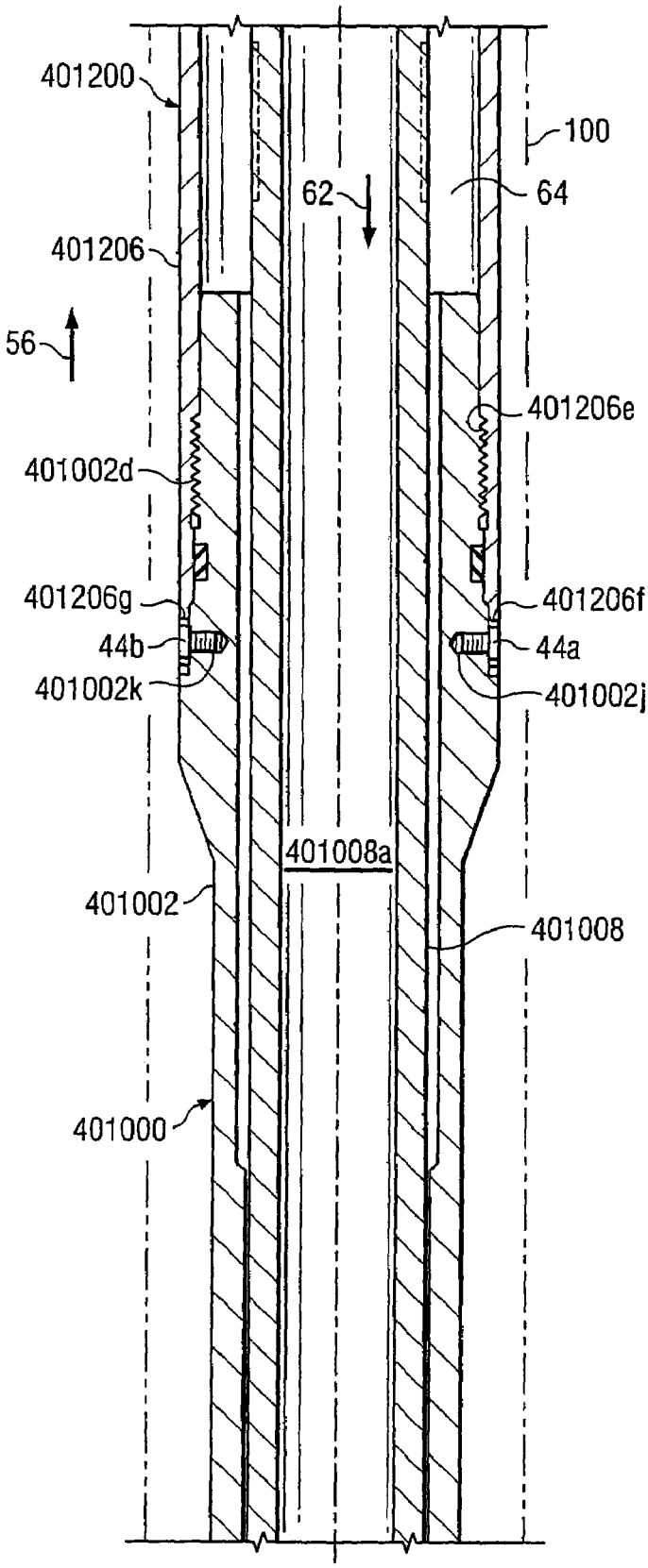
Figure 40G:
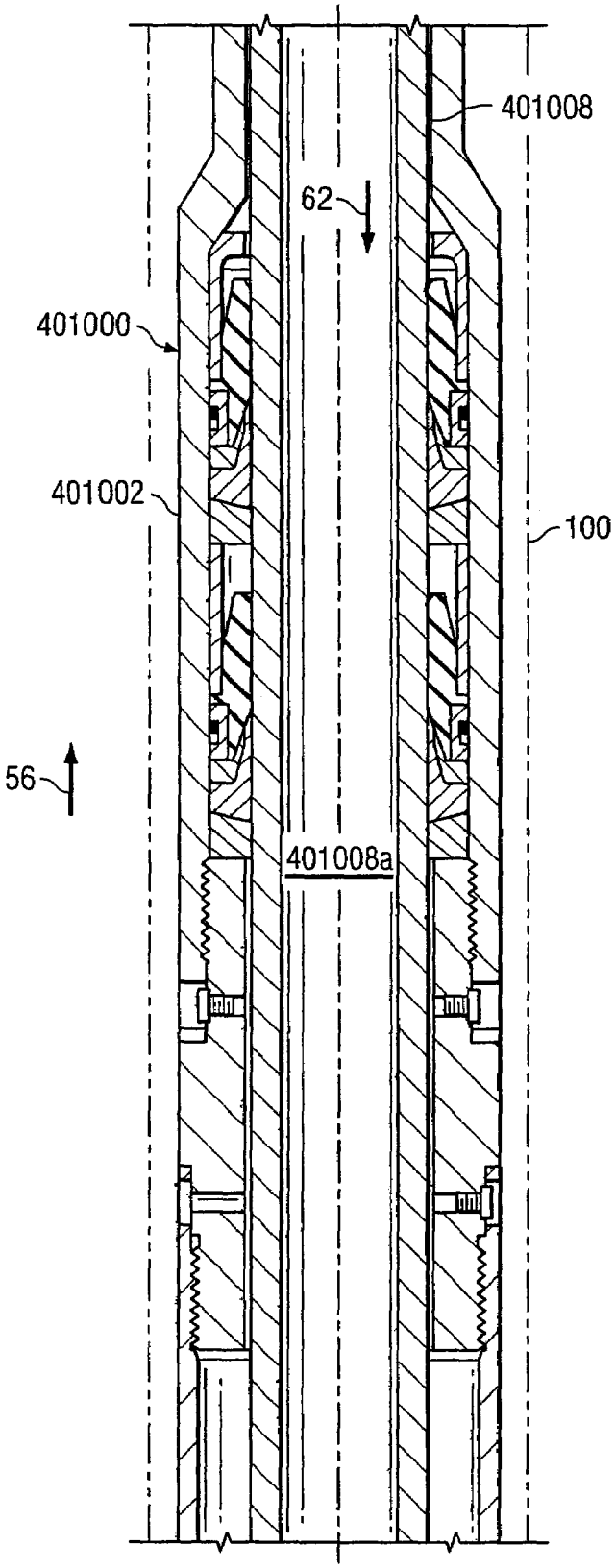
Figure 40H:
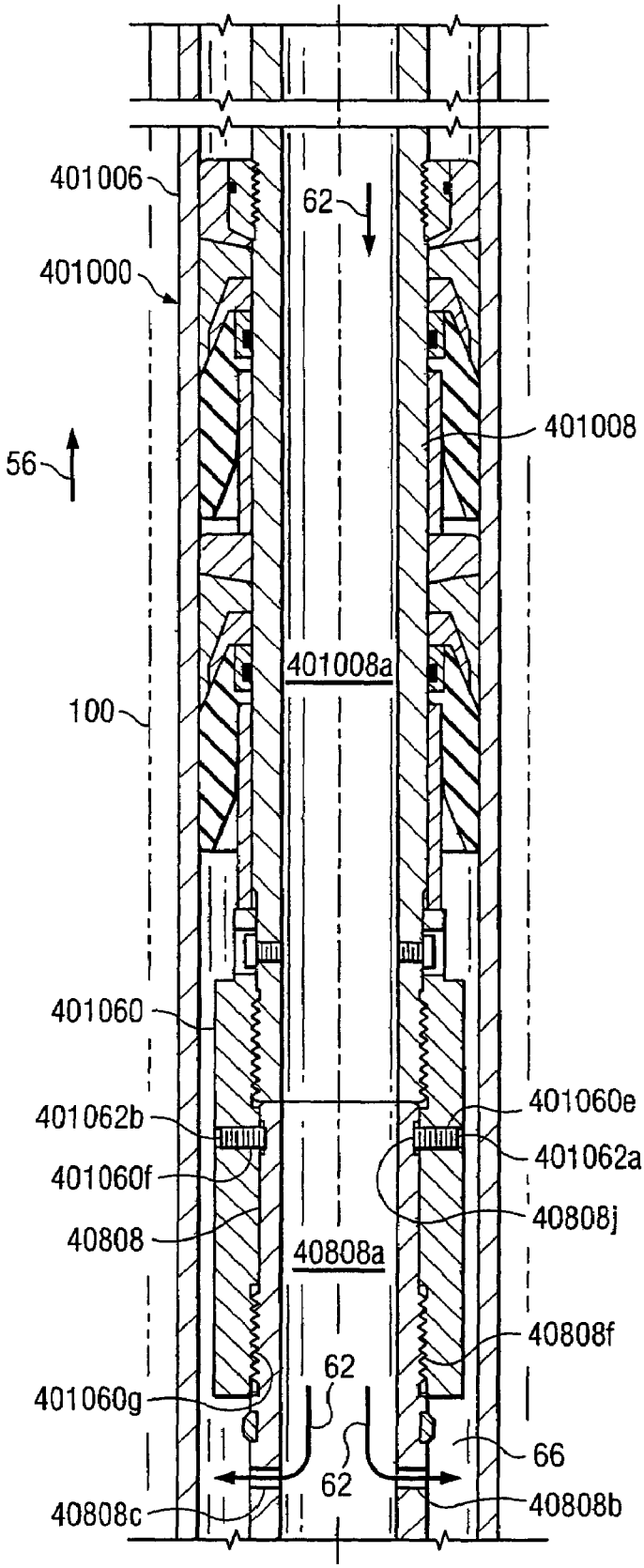
Figure 40I:
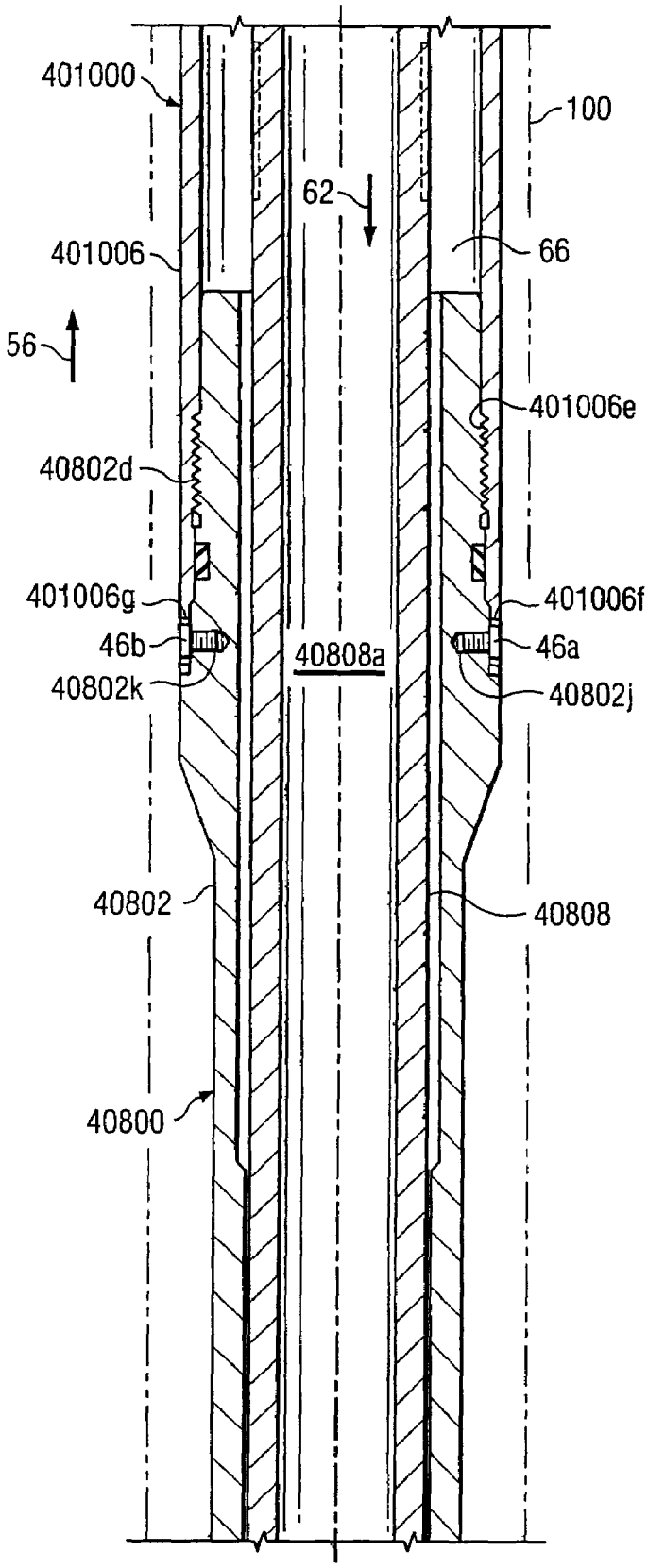
Figure 40J:
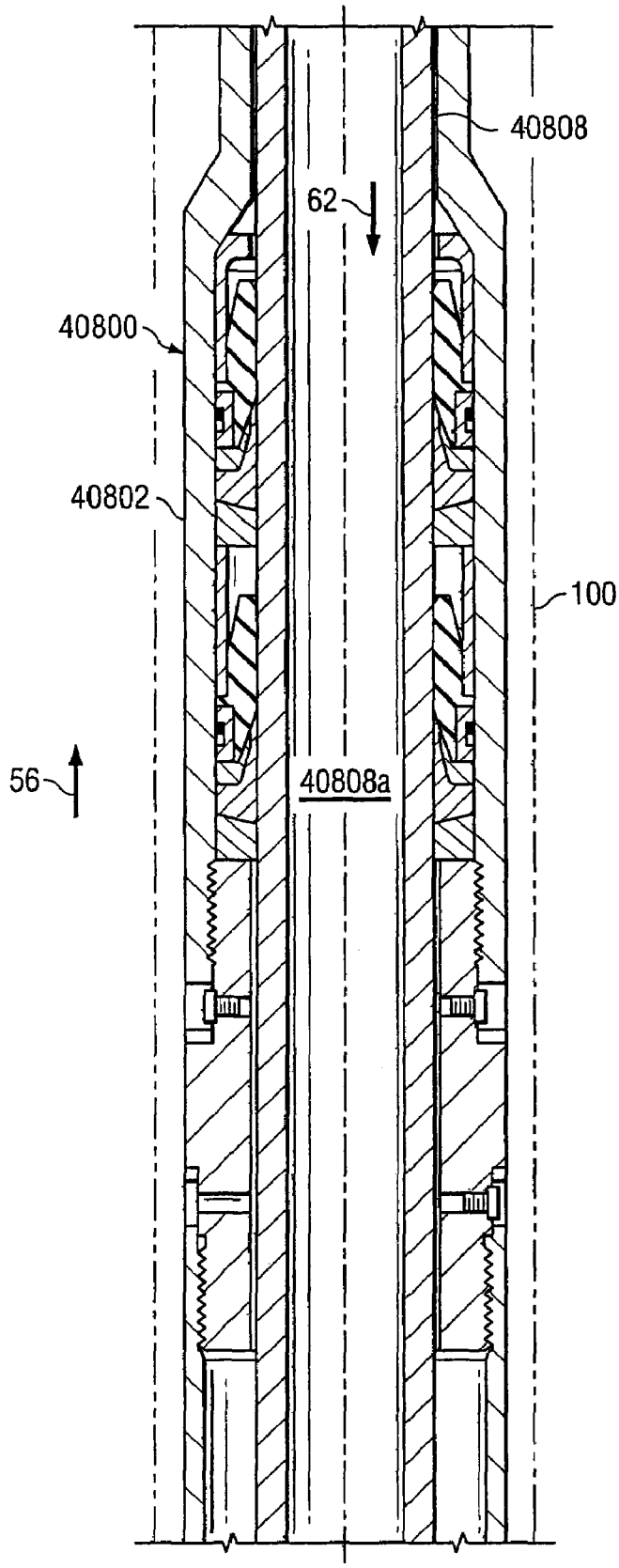
Figure 40K:
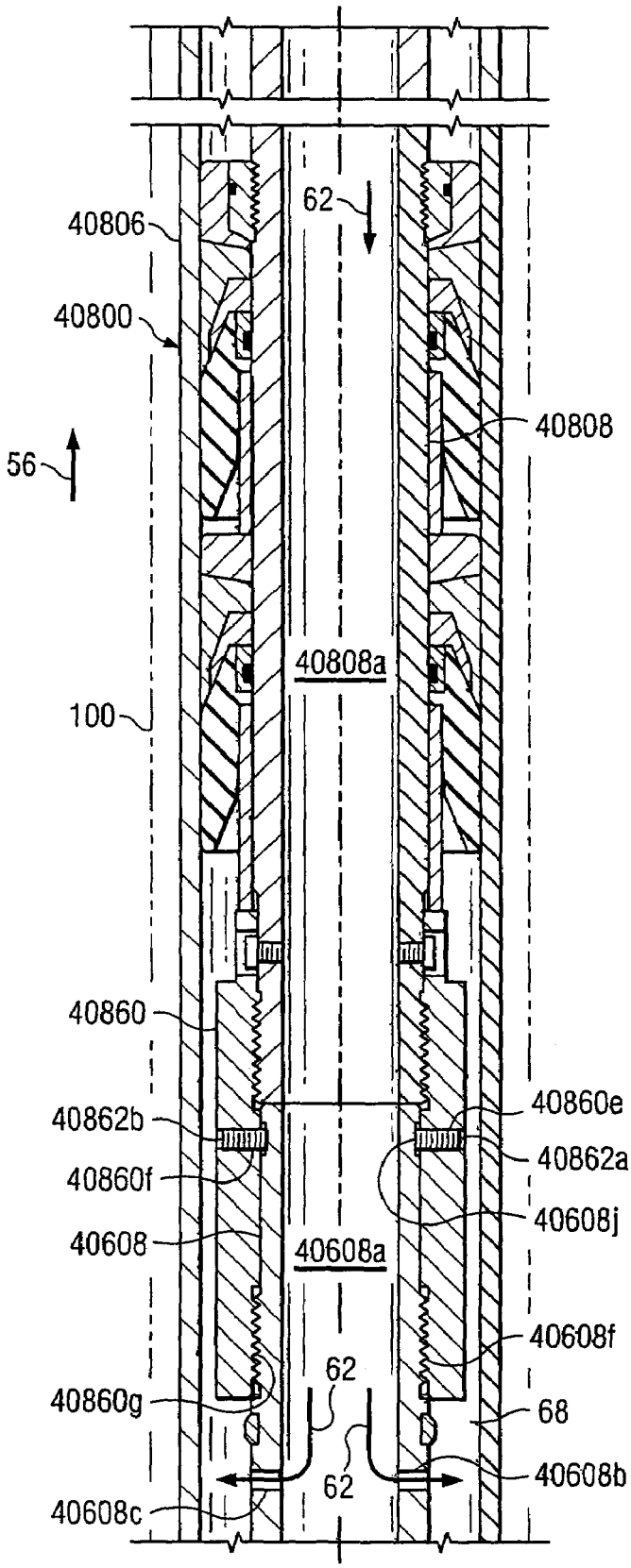
Figure 40L:
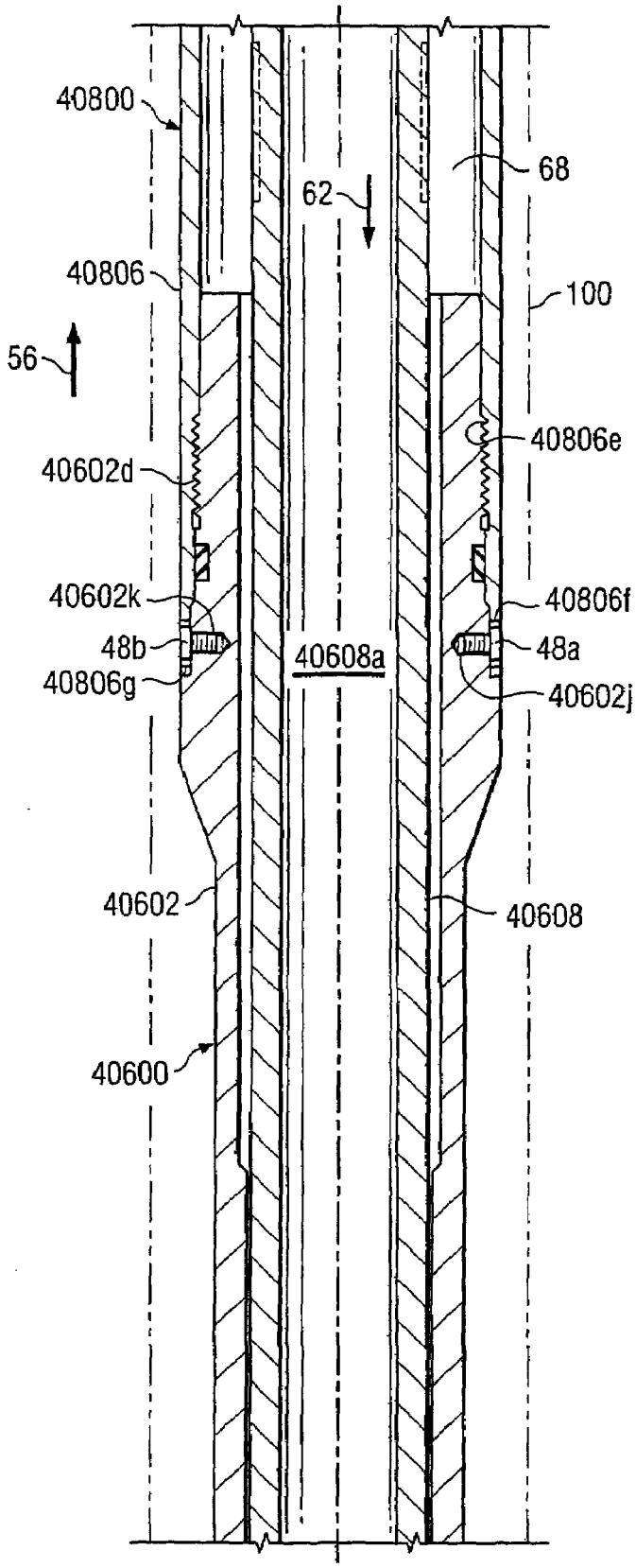
Figure 40M:
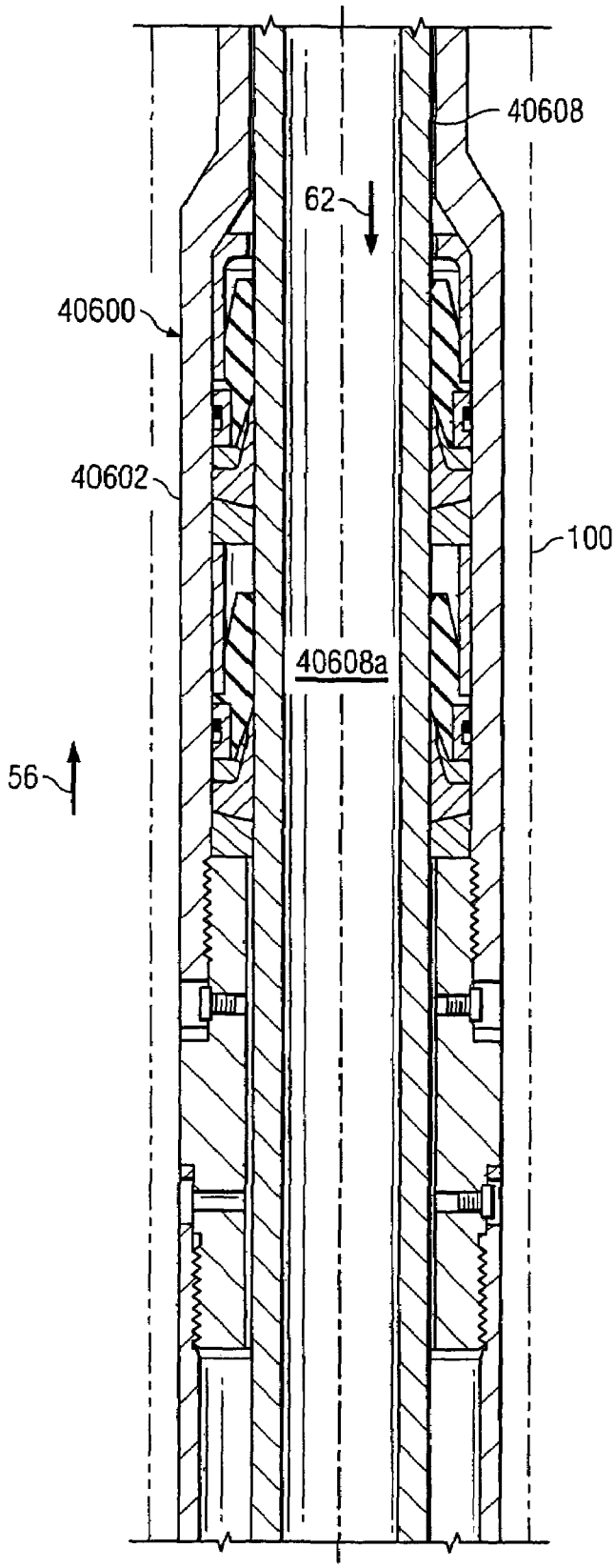
Figure 40N:
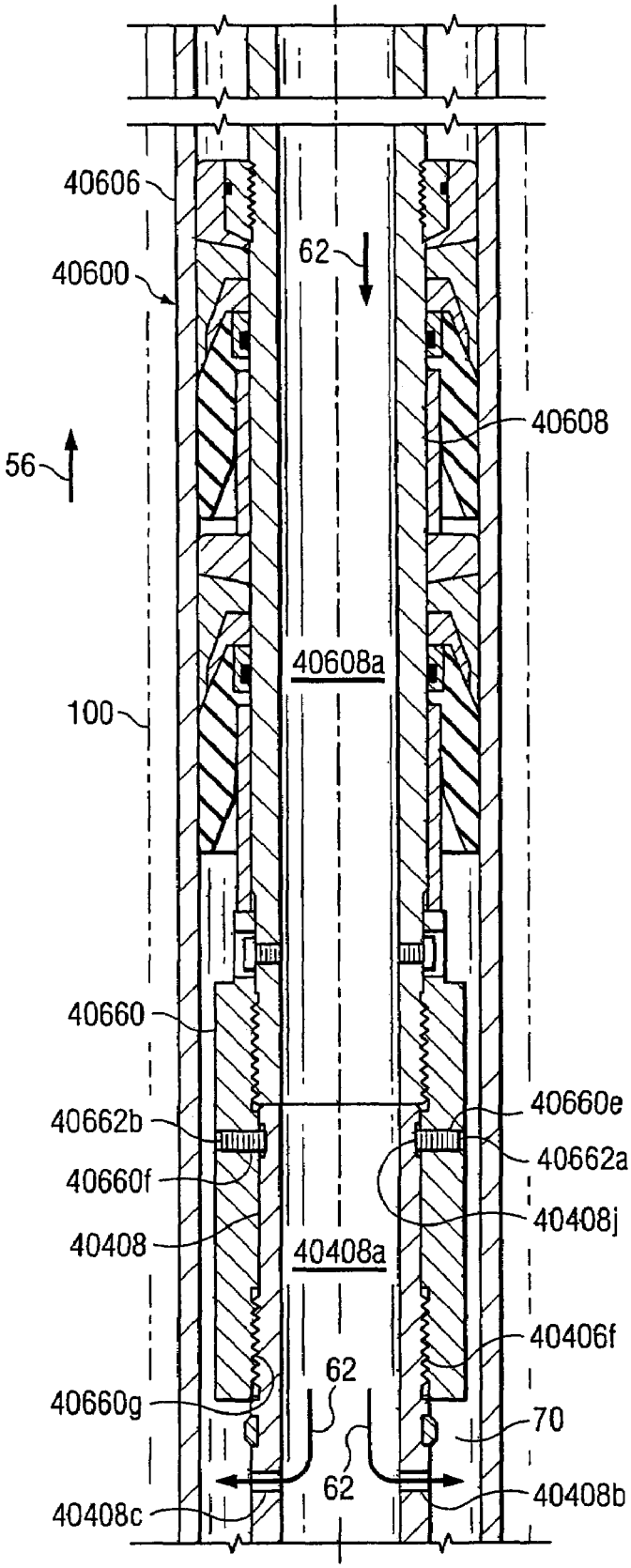
Figure 40O:
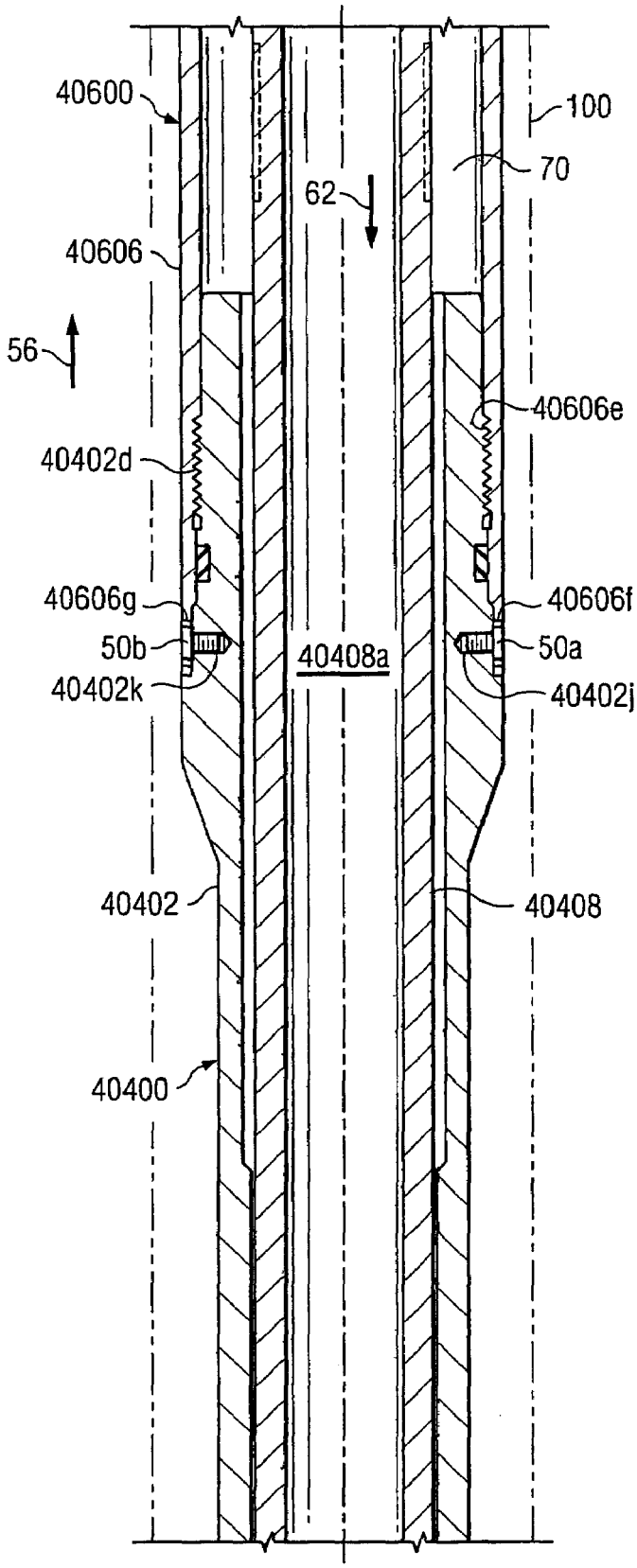
Figure 40P:
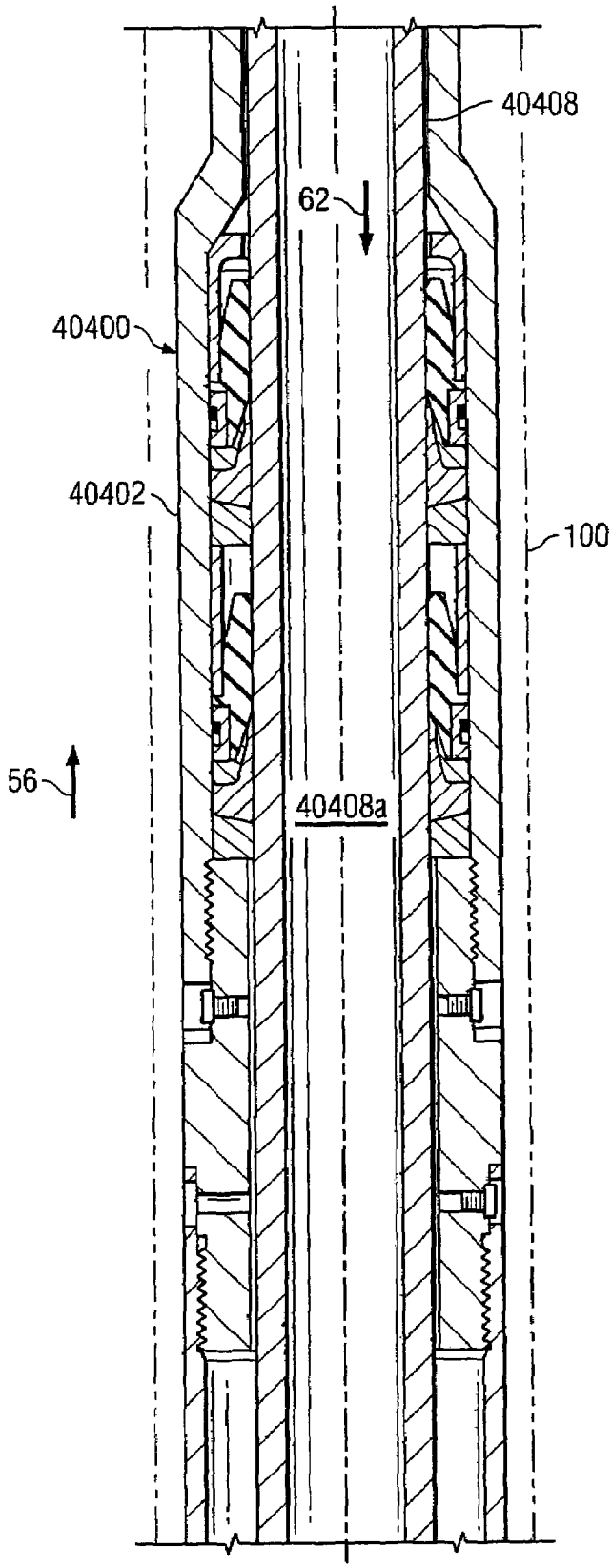
Figure 40Q:
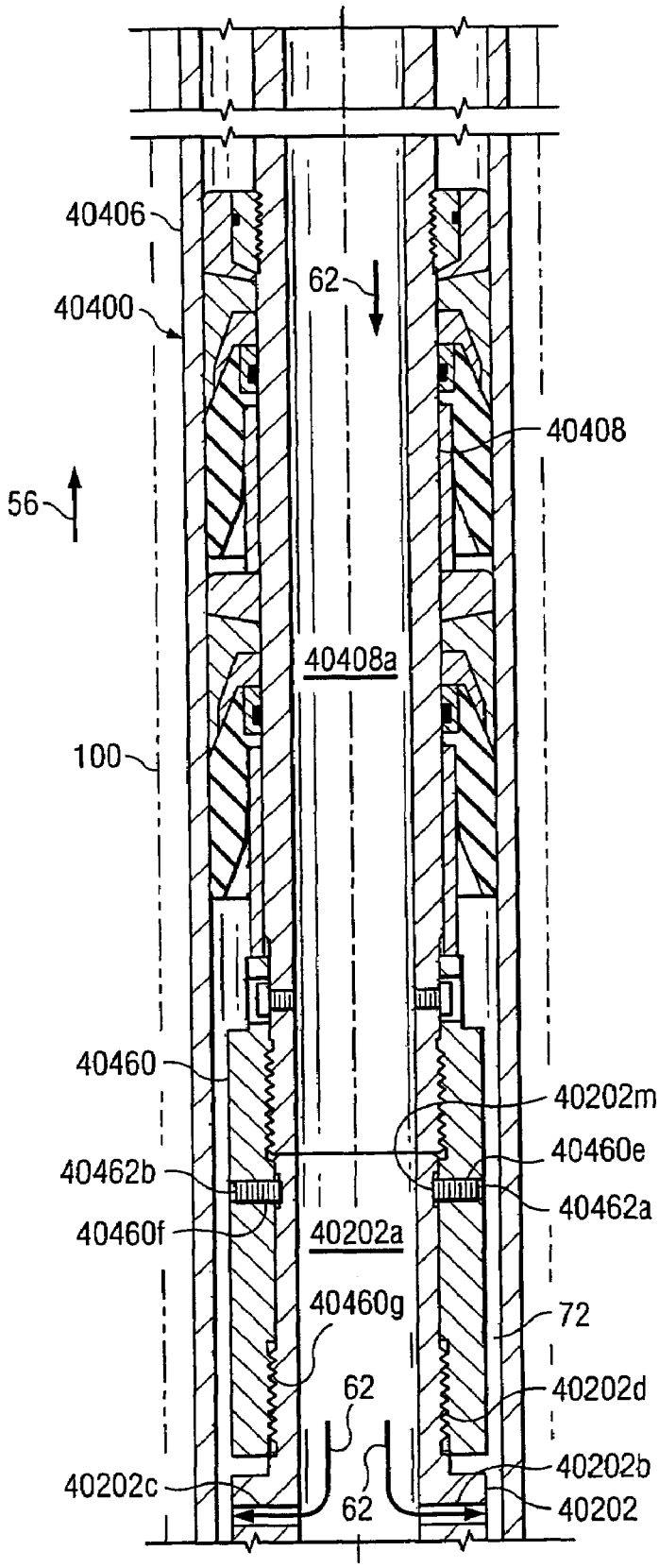
Figure 40R:
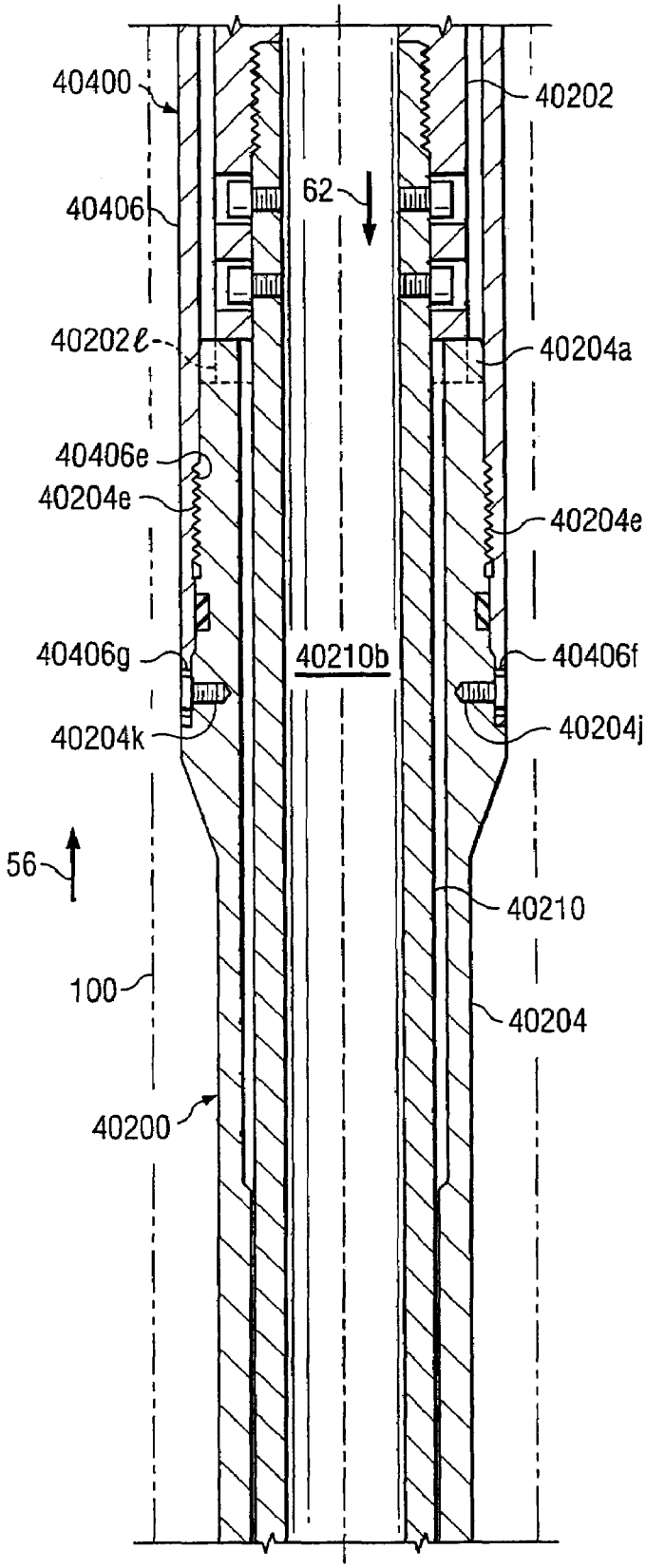
Figure 40S:
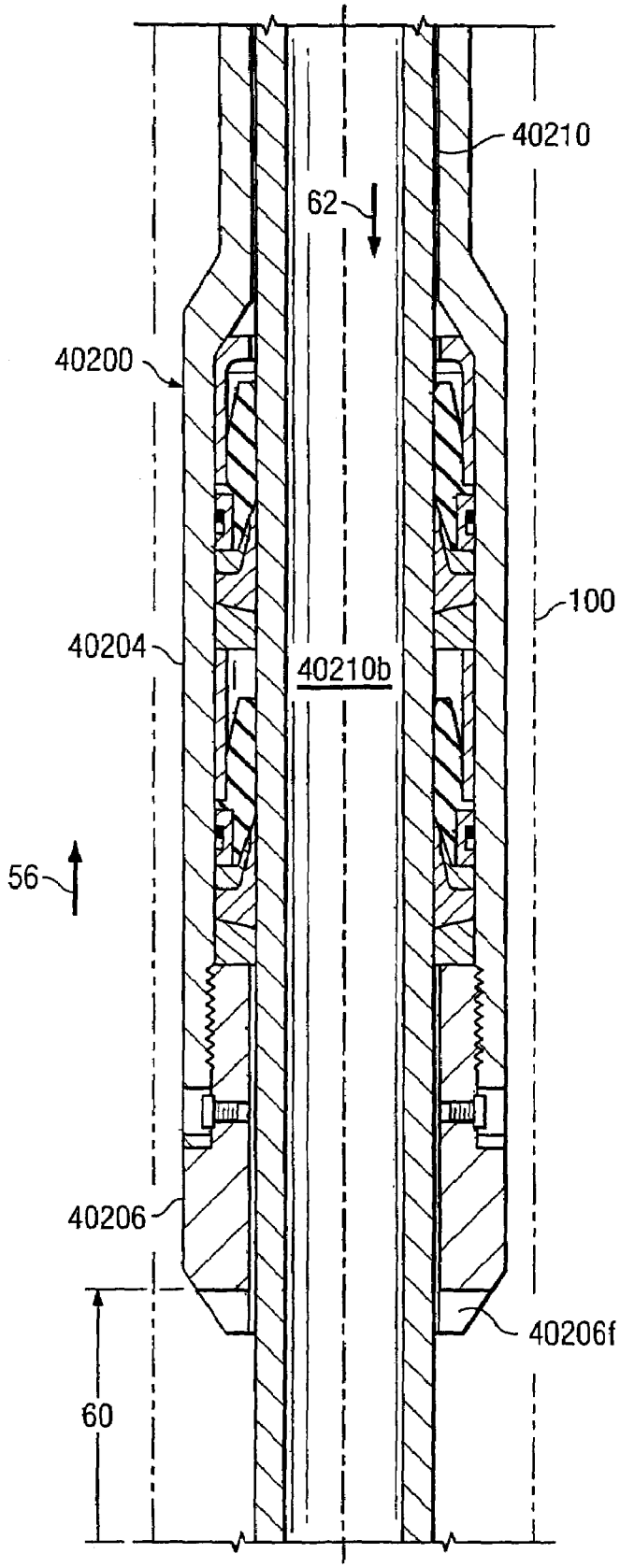
Figure 40T:
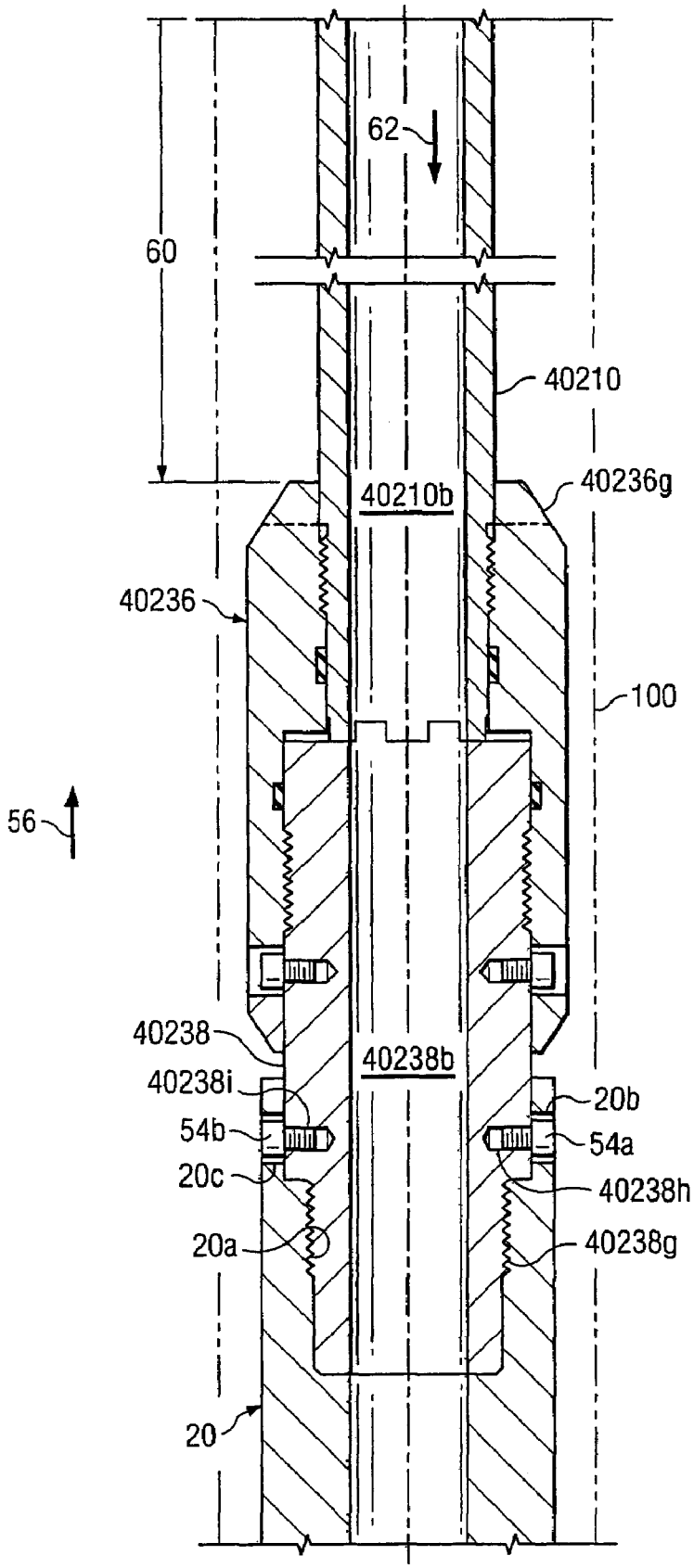

In an exemplary embodiment, as illustrated in FIGS. 40A through 40T, during operation of the tension actuator assembly 40, and after the tension actuator assembly 40 is positioned in the casing 100, the tension actuator assembly 40 is placed in its extended configuration, and the ball gripper assembly 16 is operated, fluidic material 62 is injected into the tension actuator assembly 40 through the passages 401404*b*, 401402*a*, 401266*b*, 401208*a*, 401008*a*, 40808*a*, 40608*a*, 40408*a*, 40202*a*, 40210*b* and 40238*b*. The injected fluidic material 62 will also pass through the radial openings, 401008*b* and 401008*c*, and into an adjustable annular region 64 generally defined by the inside surface of the barrel 401206 and the outside surface of the connecting rod 401008, through the radial openings, 40808*b* and 40808*c*, and into an adjustable annular region 66 generally defined by the inside surface of the barrel 401006 and the outside surface of the connecting rod 40808, through the radial openings, 40608*b* and 40608*c*, and into an adjustable annular region 68 generally defined by the inside surface of the barrel 40806 and the outside surface of the connecting rod 40608, through the radial openings, 40408*b* and 40408*c*, and into an adjustable annular region 70 generally defined by the inside surface of the barrel 40606 and the outside surface of the connecting rod 40408. The fluidic material 62 will also pass through the radial passages, 40202*b* and 40202*c*, and into an adjustable annular region 72 generally defined by the inside surface of the barrel 40406 and the outside surface of the connecting rod 40210.

Figure 41A:
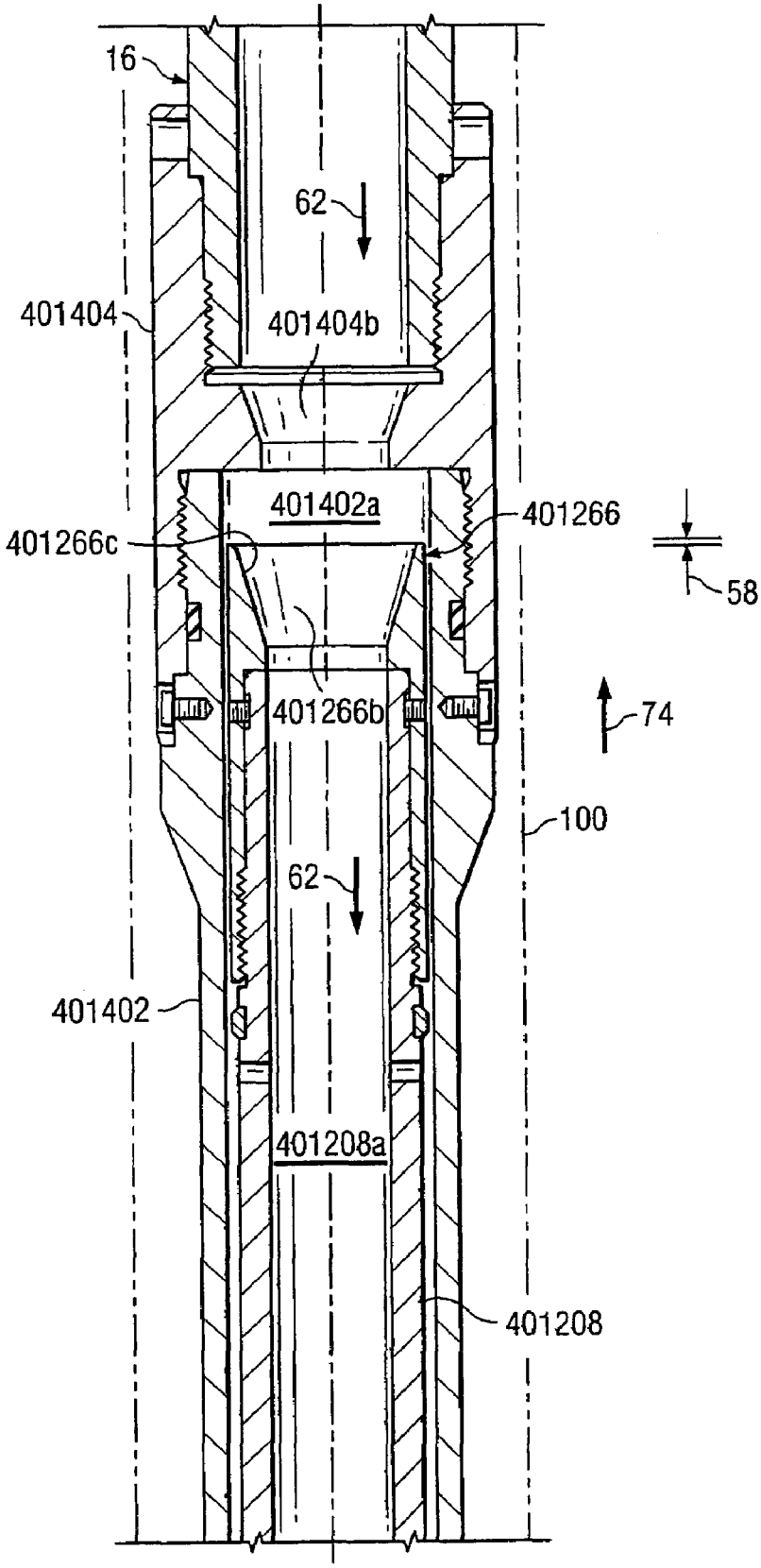
Figure 41B:
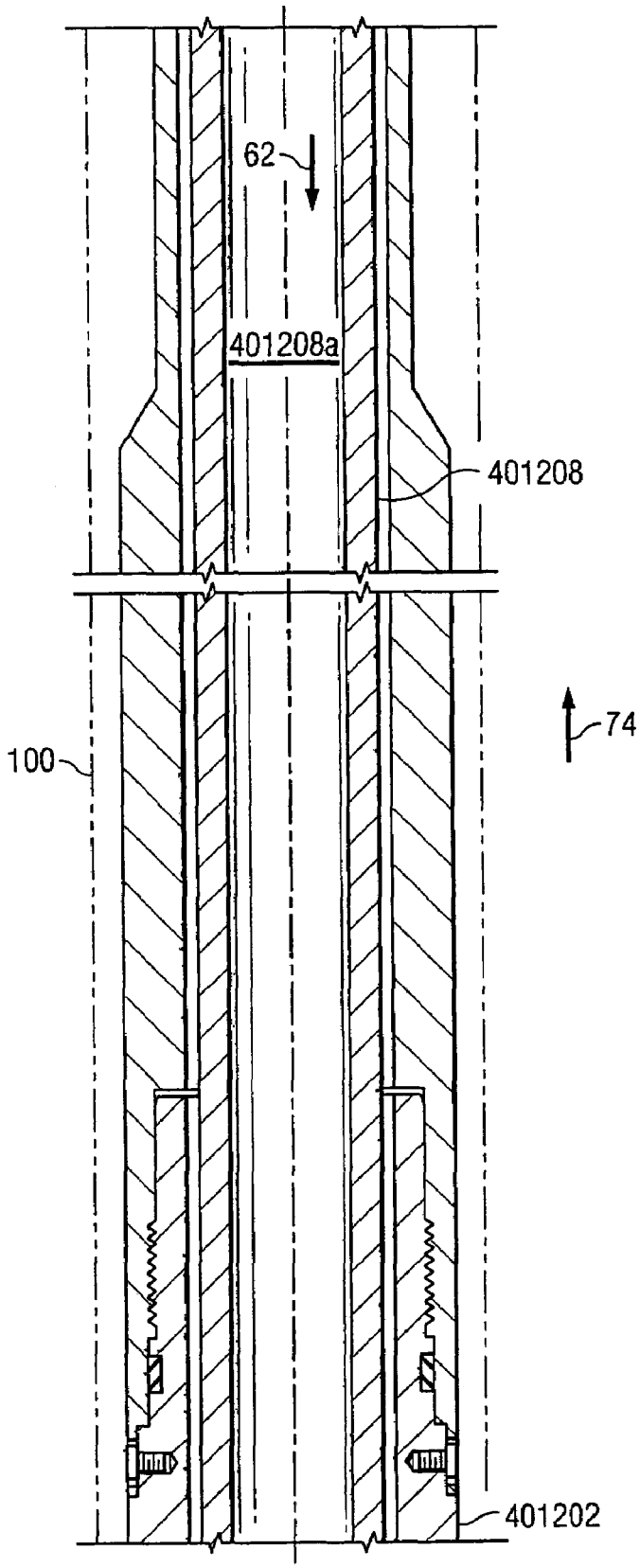
Figure 41C:
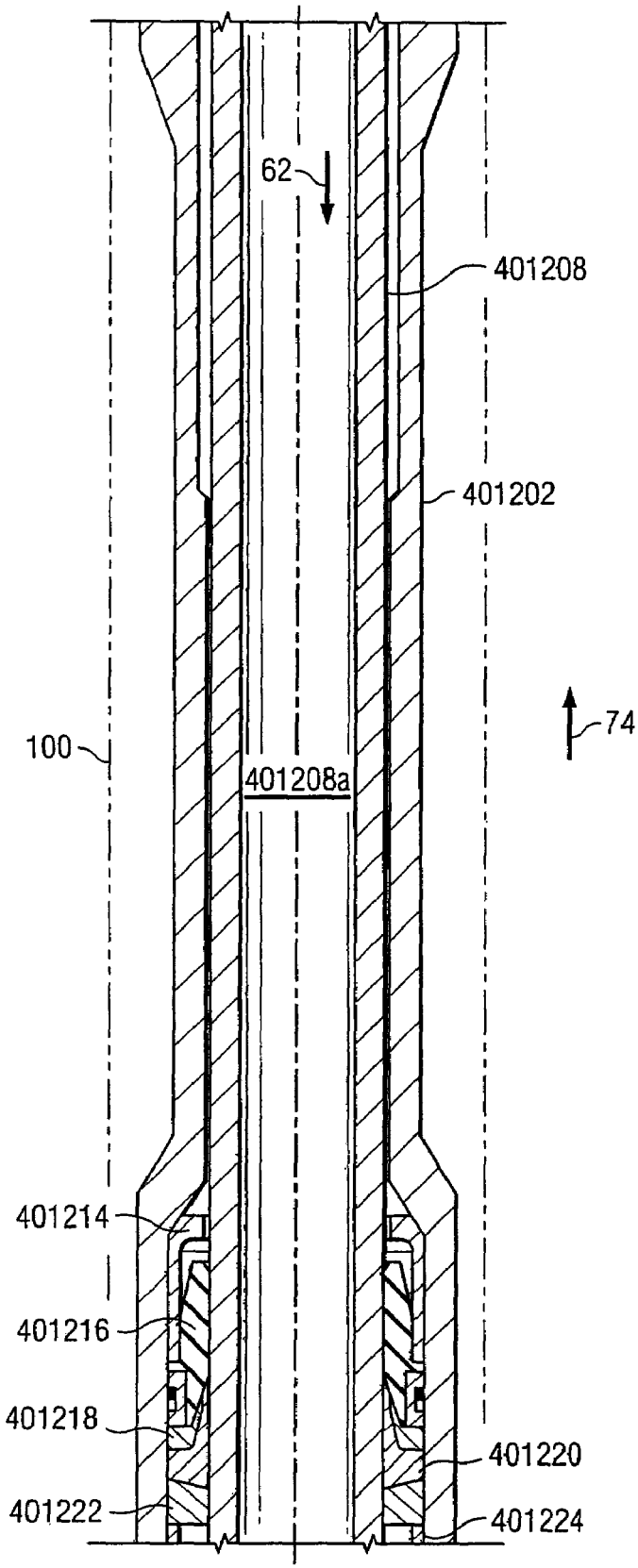
Figure 41D:
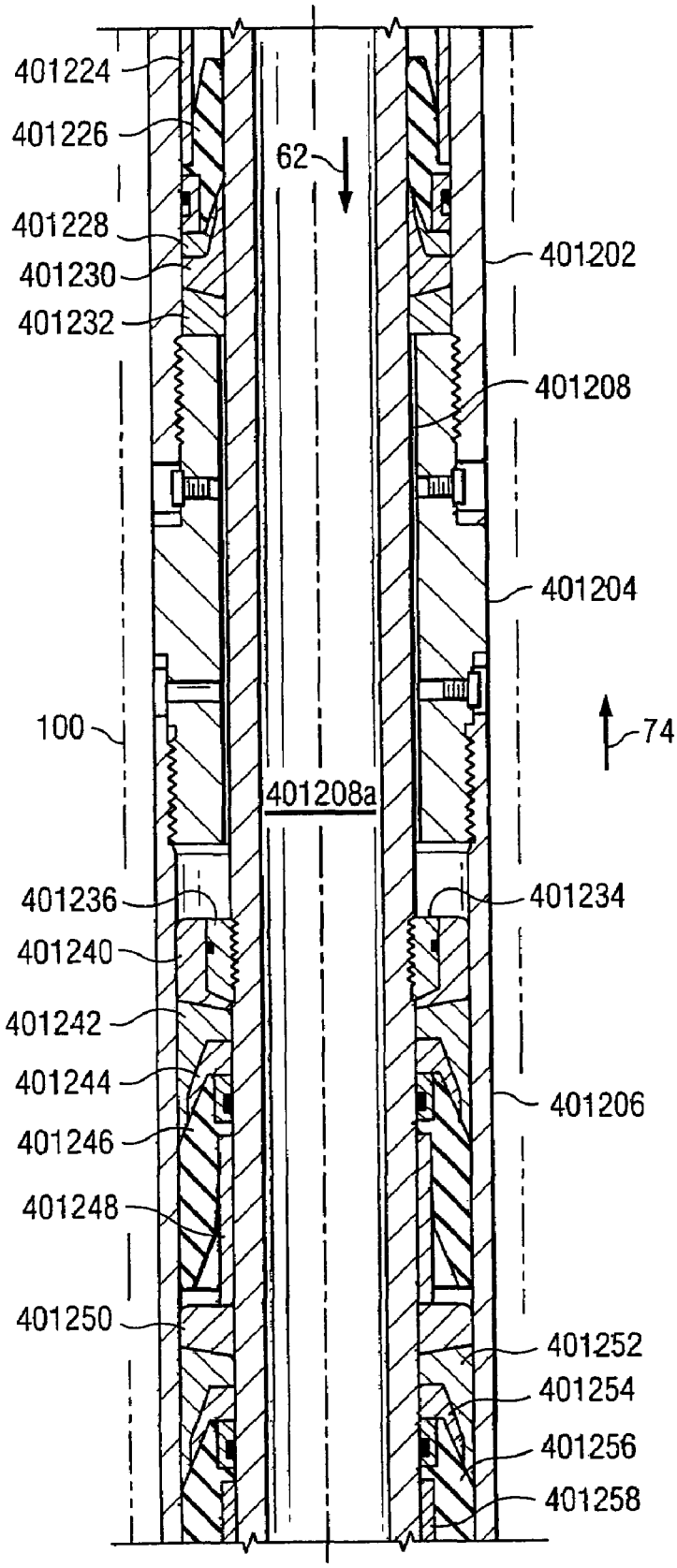
Figure 41E:
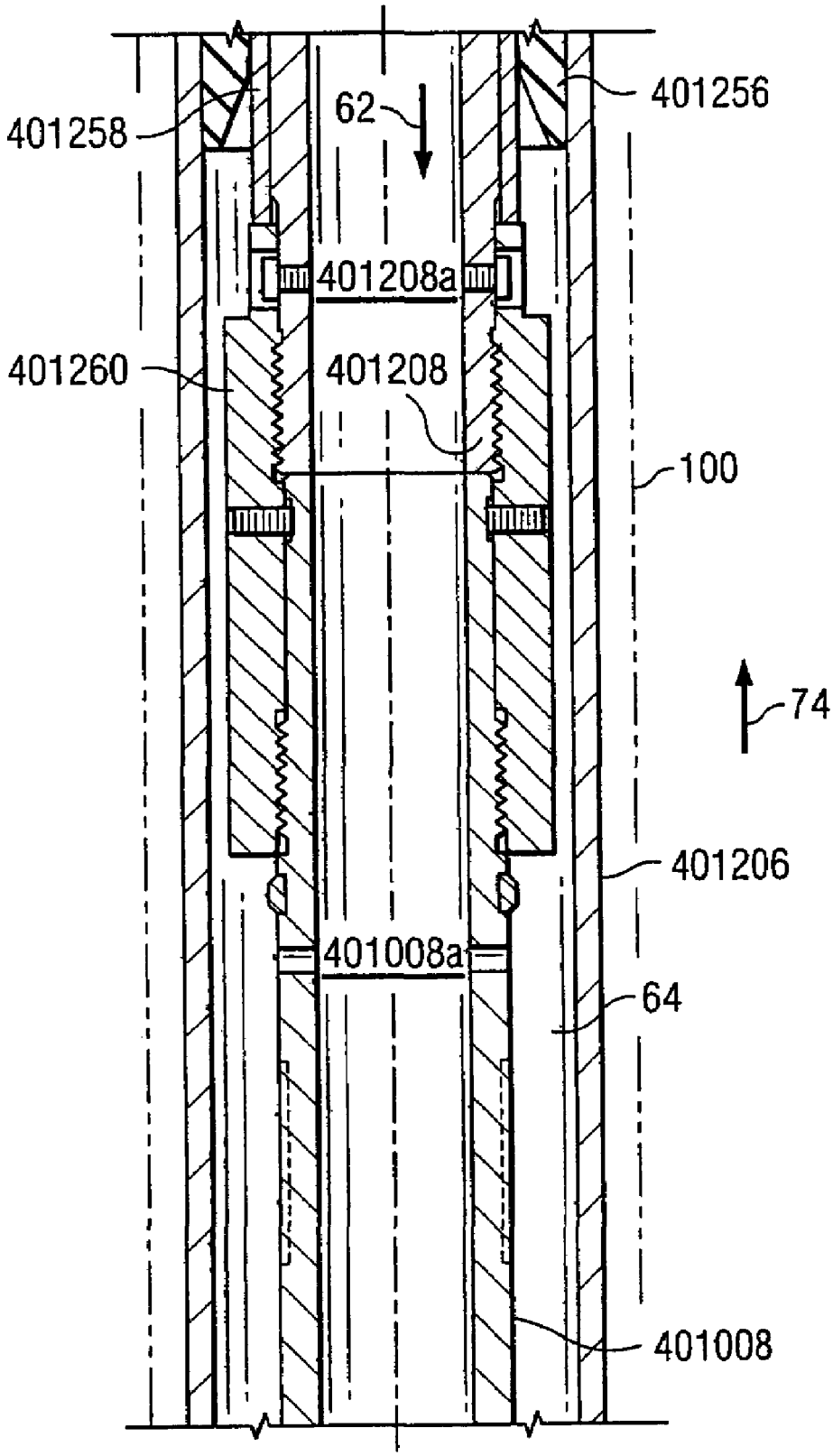
Figure 41F:
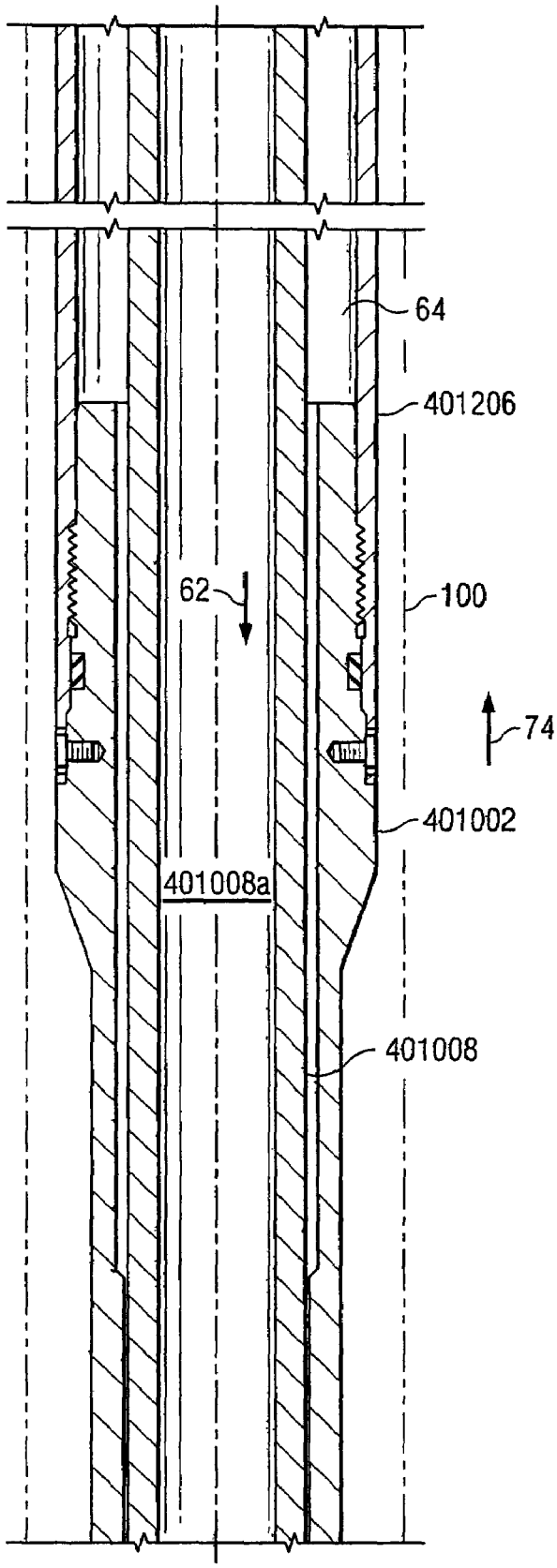
Figure 41G:
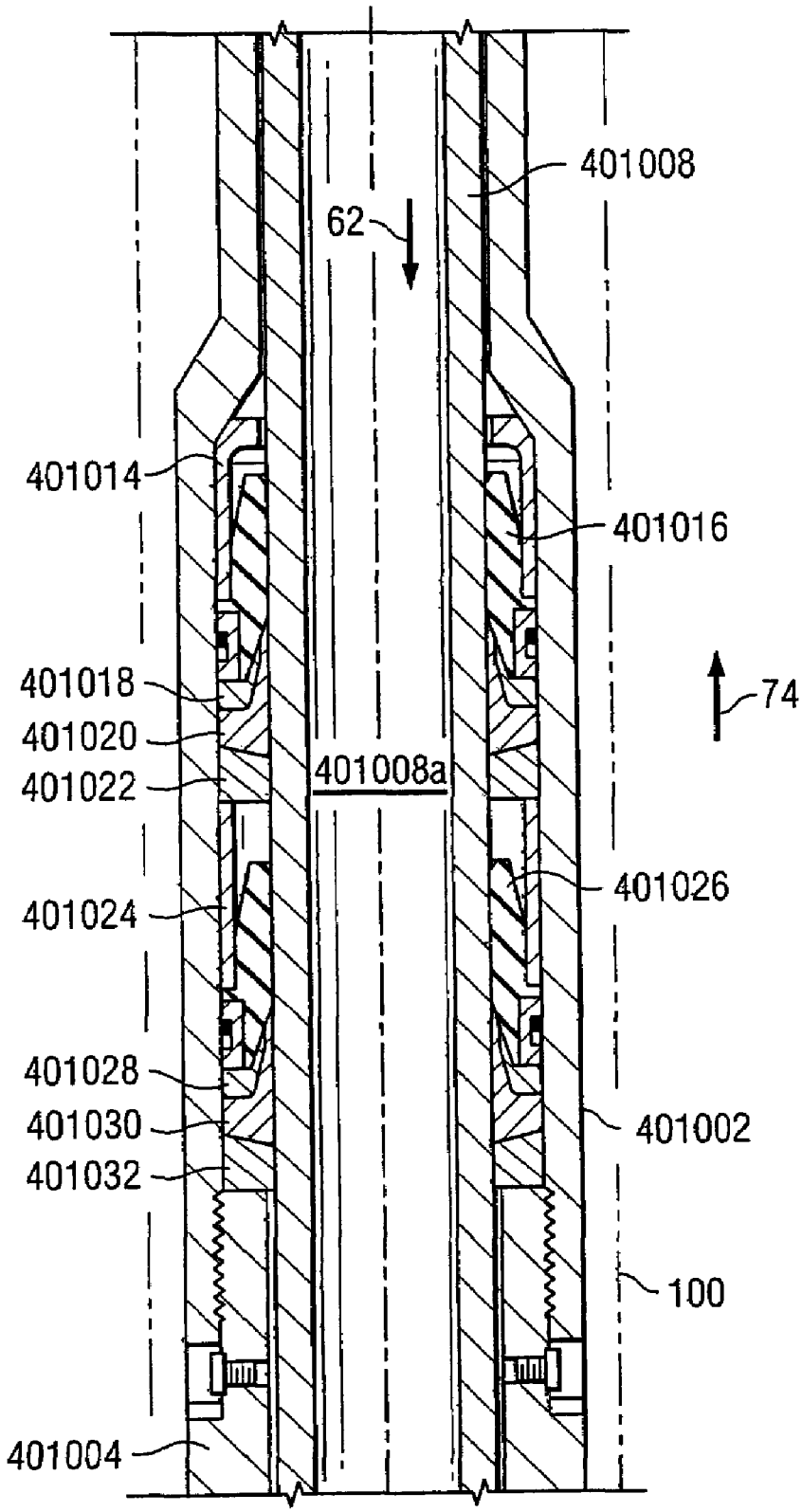
Figure 41H:
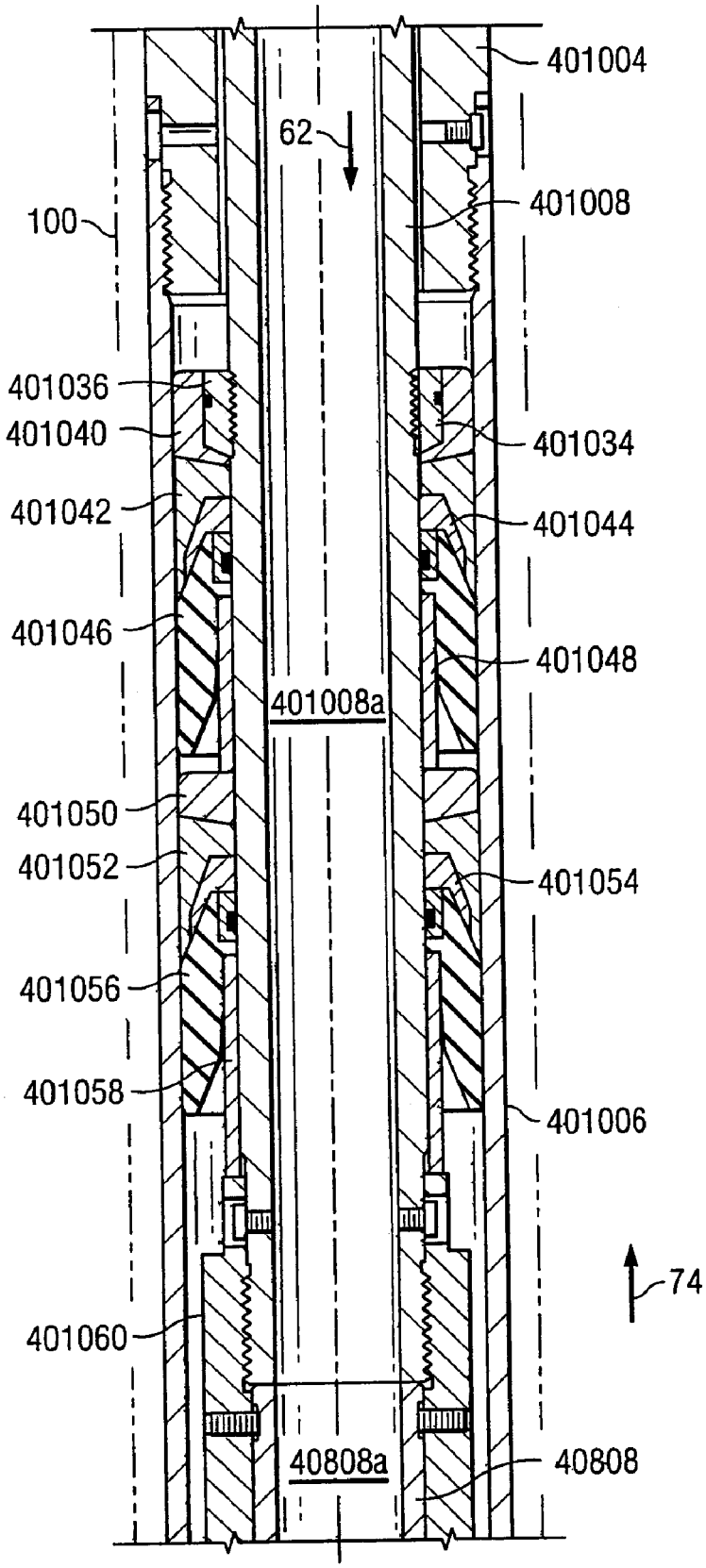
Figure 41I:
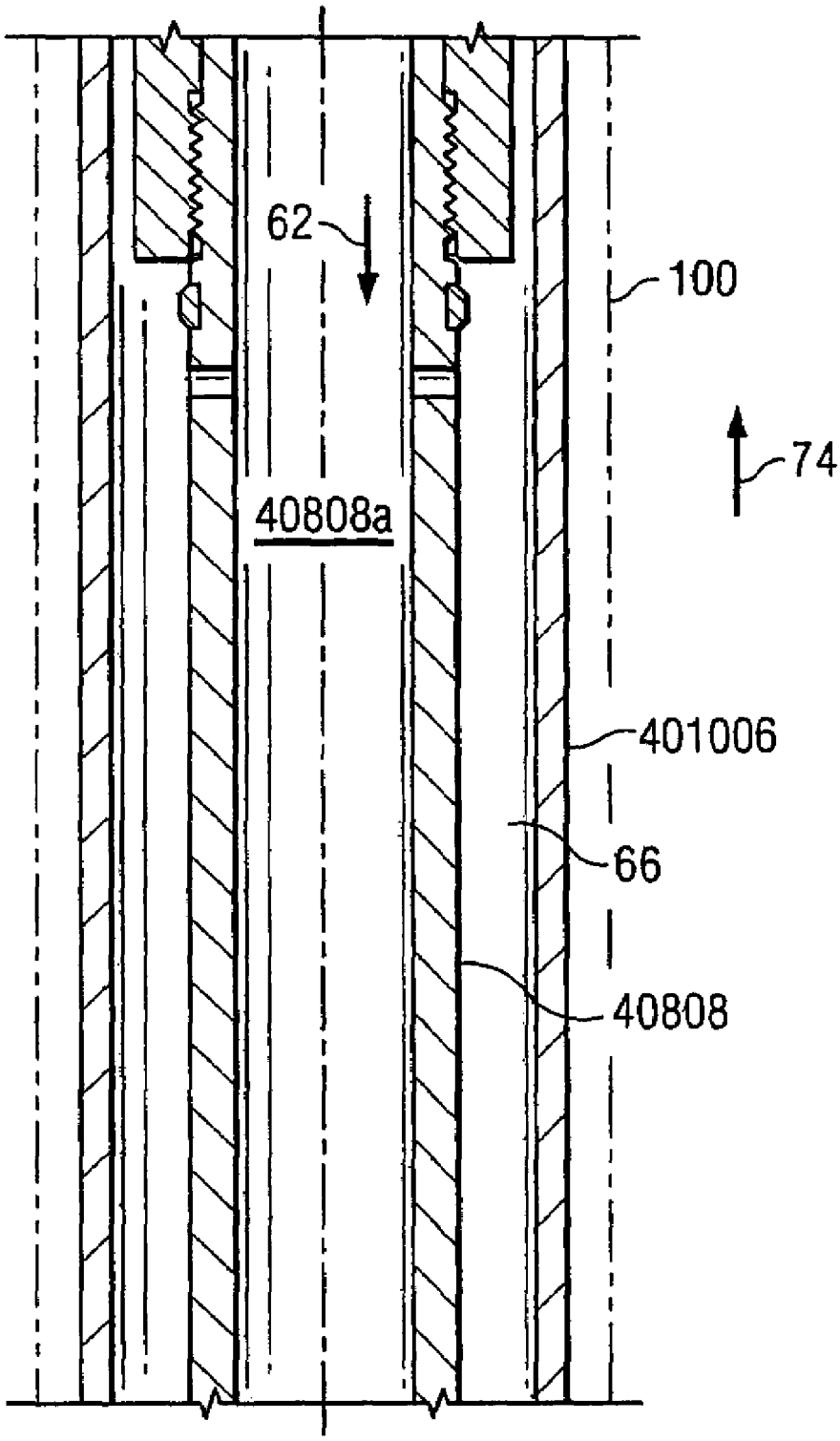
Figure 41J:
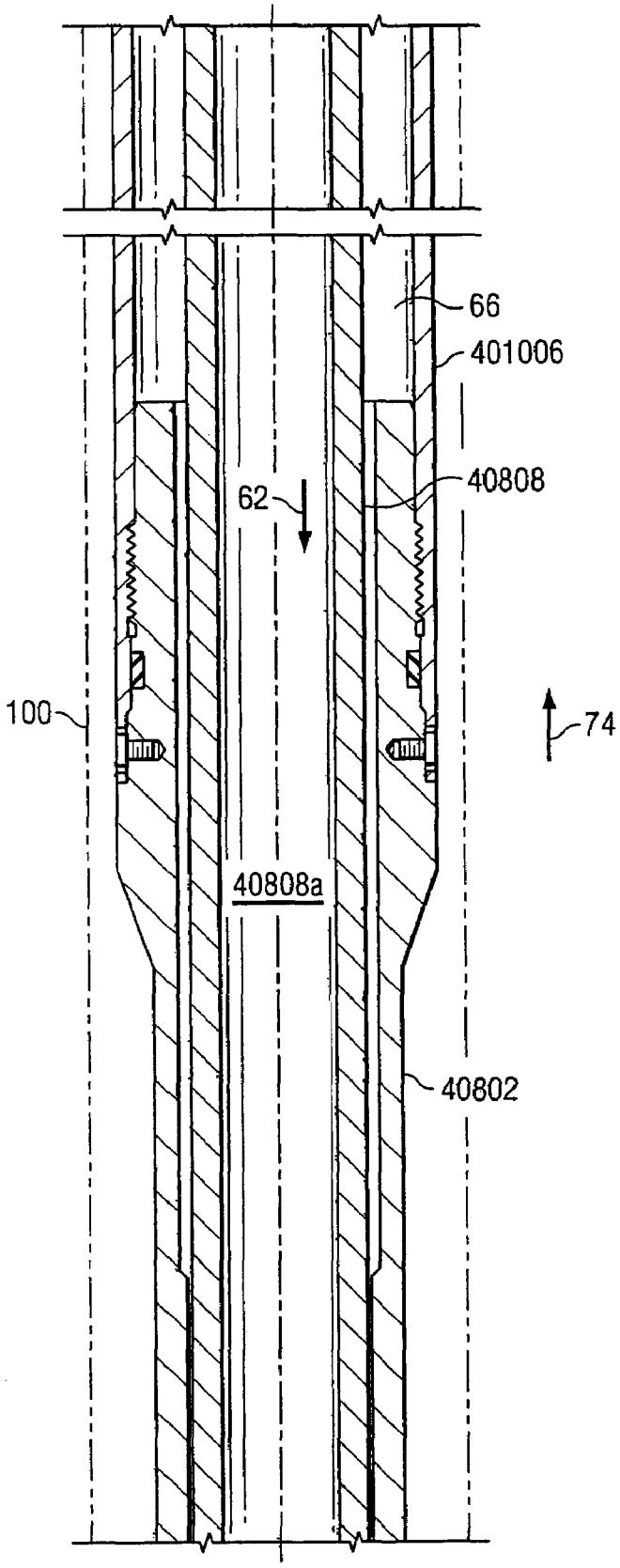
Figure 41K:
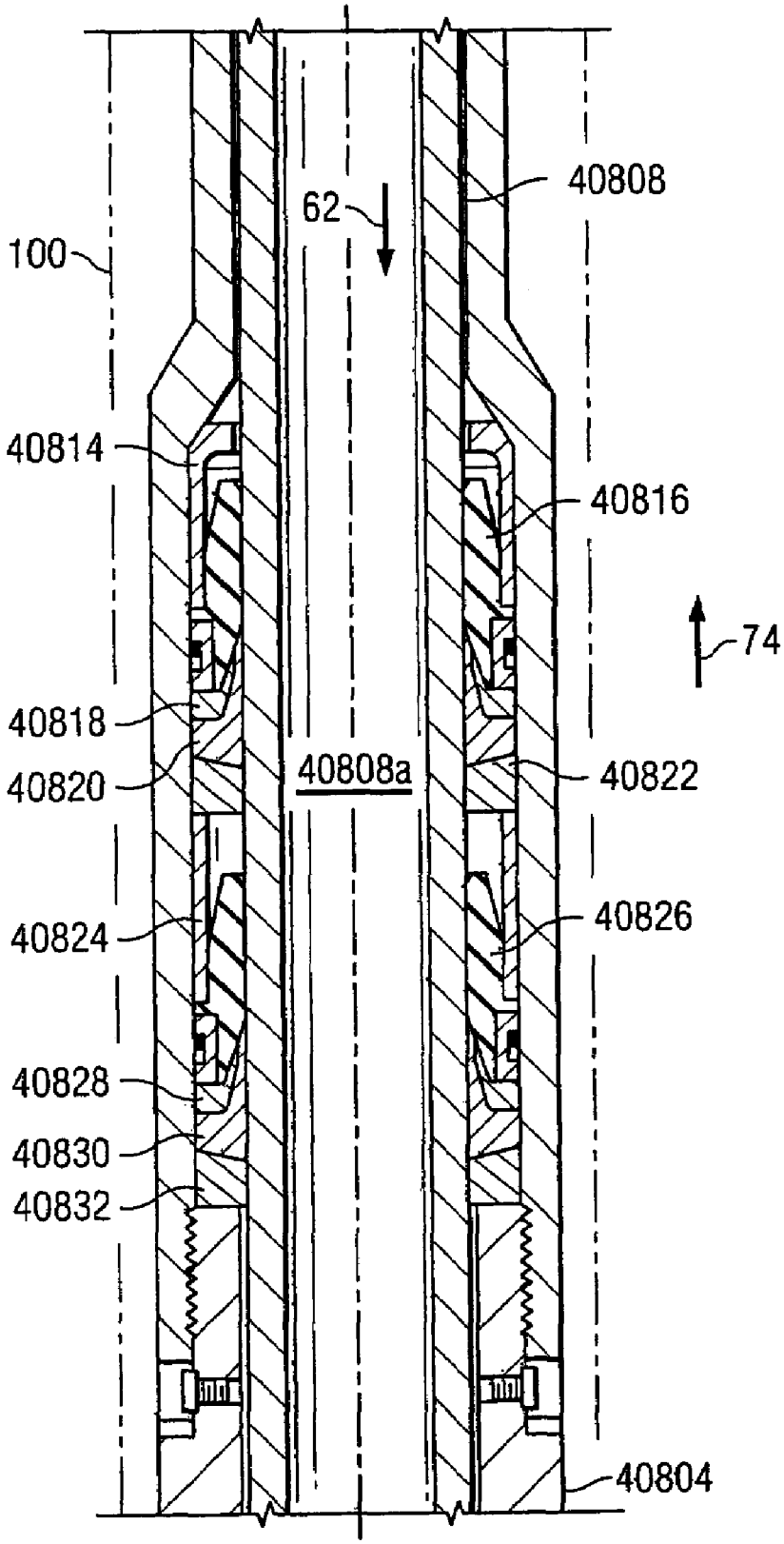
Figure 41L:
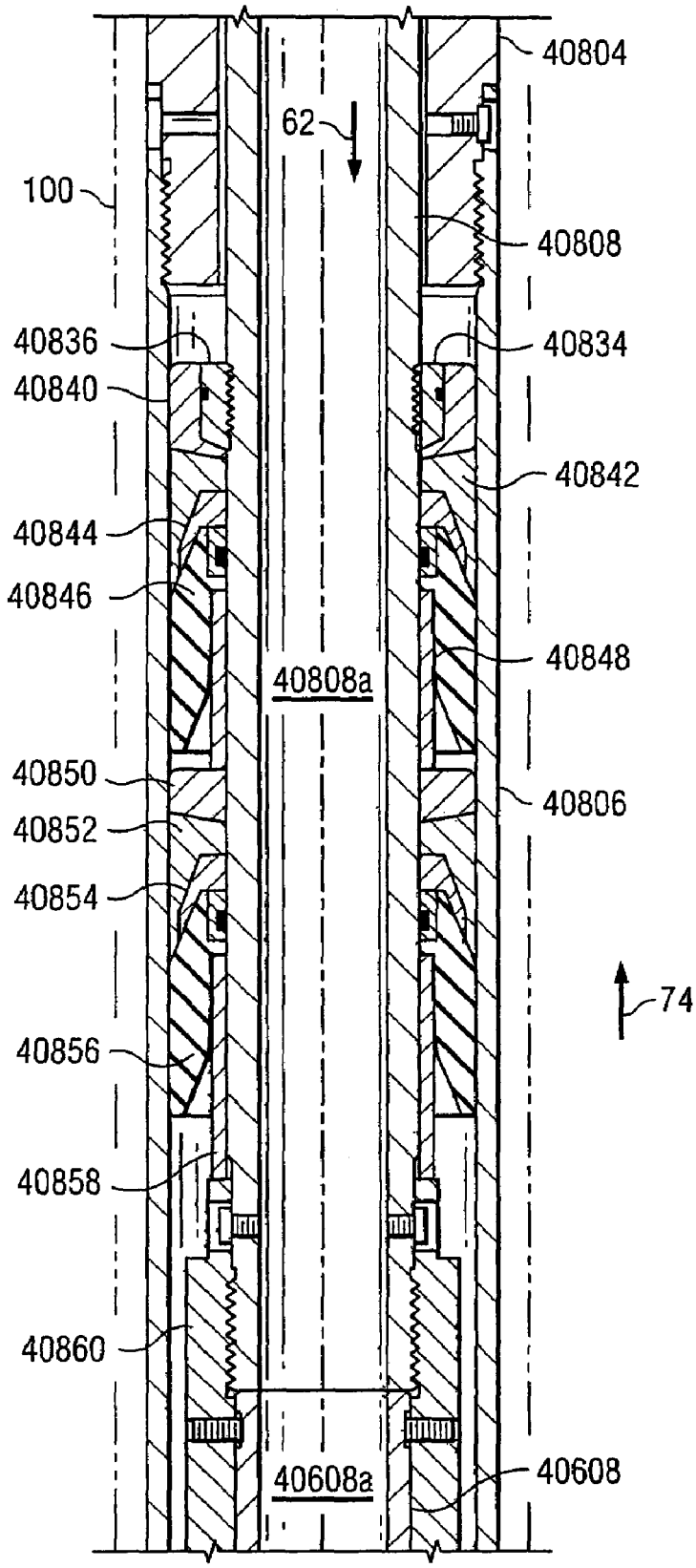
Figure 41M:
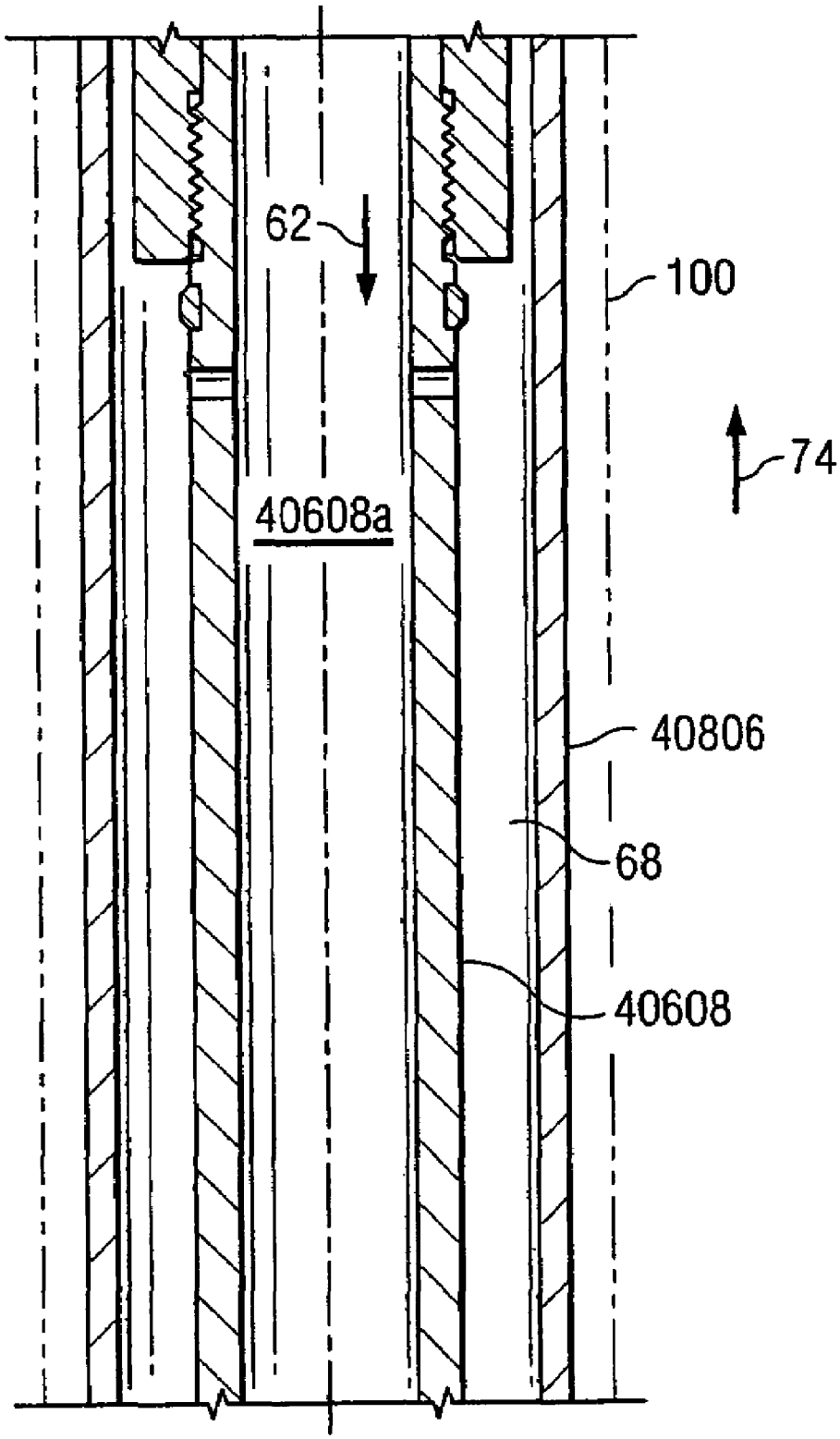
Figure 41N:
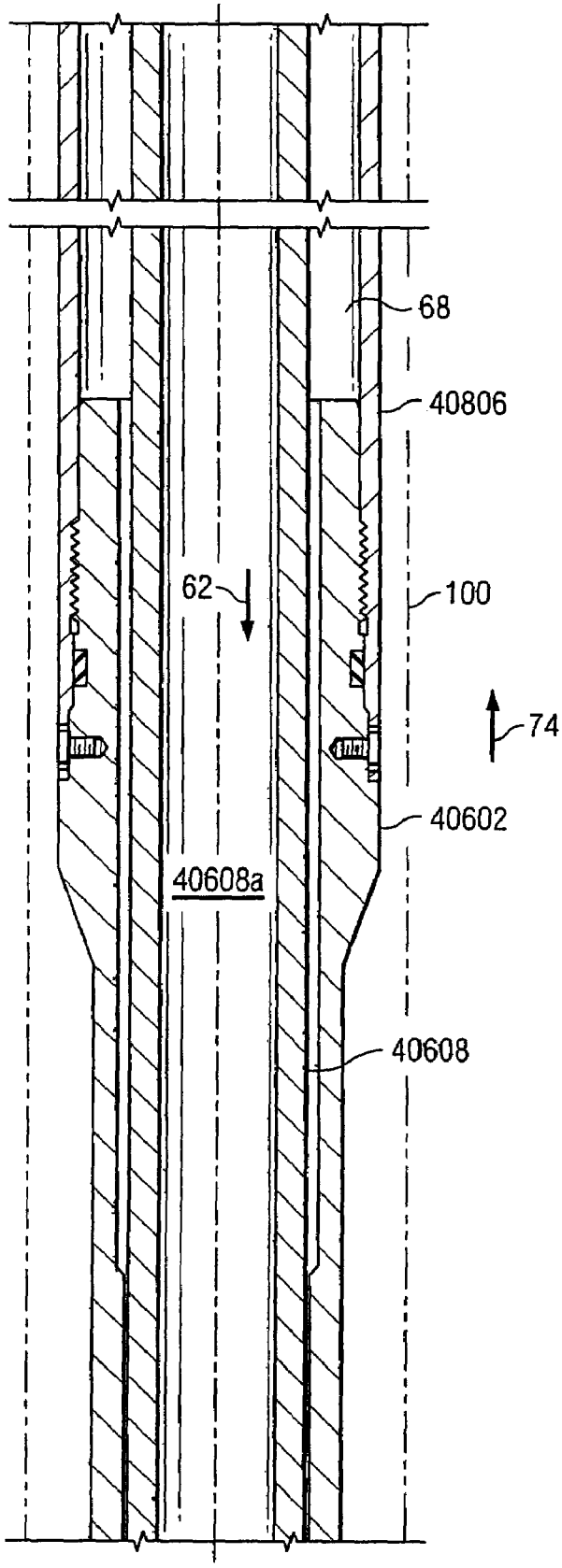
Figure 41O:
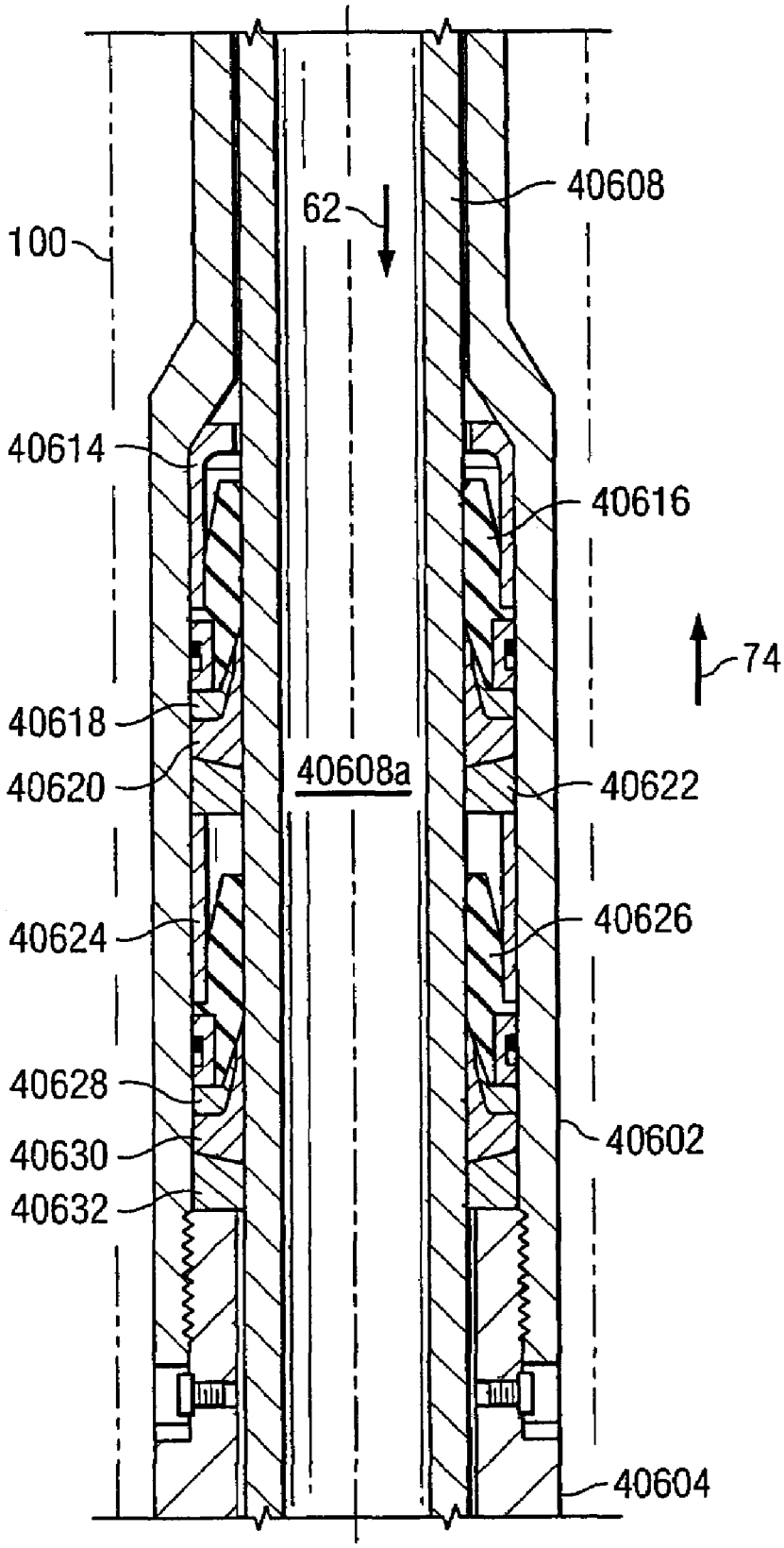
Figure 41P:
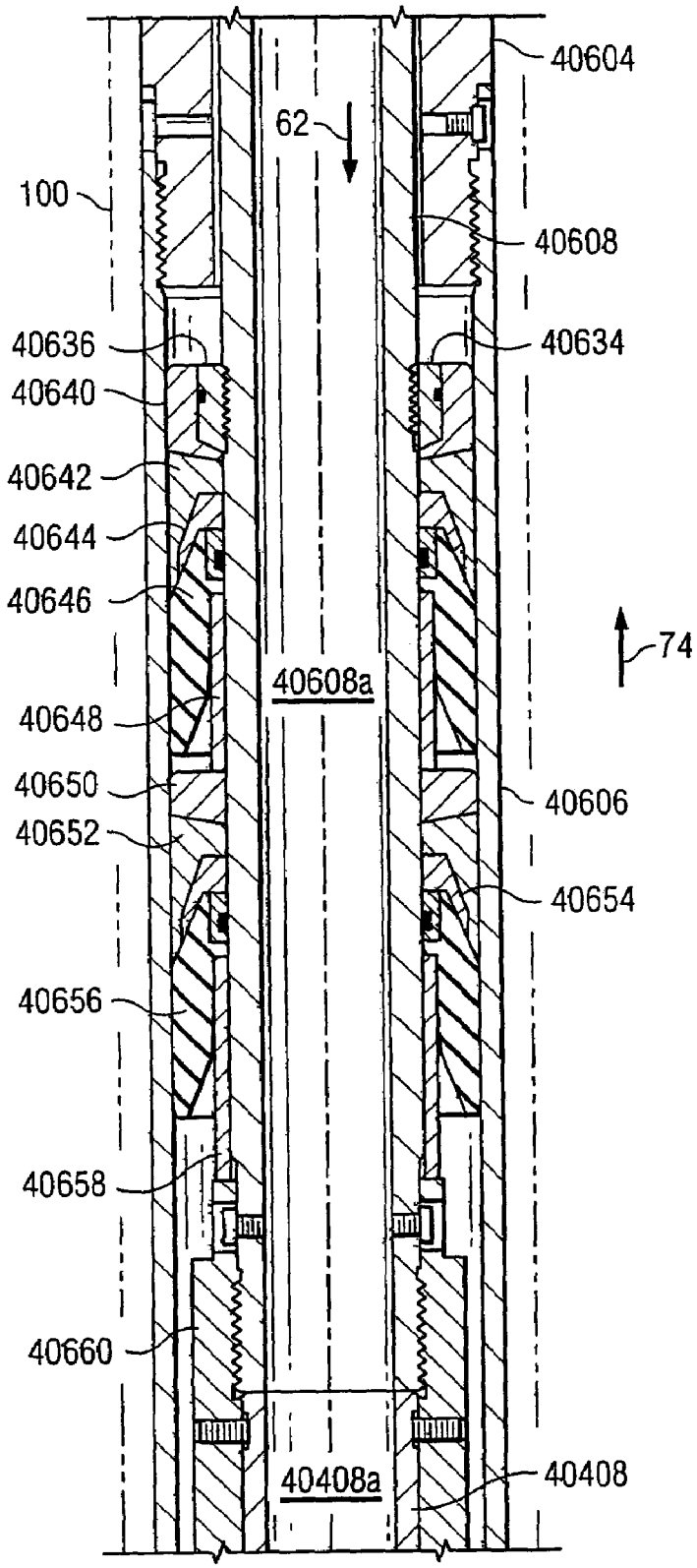
Figure 41Q:
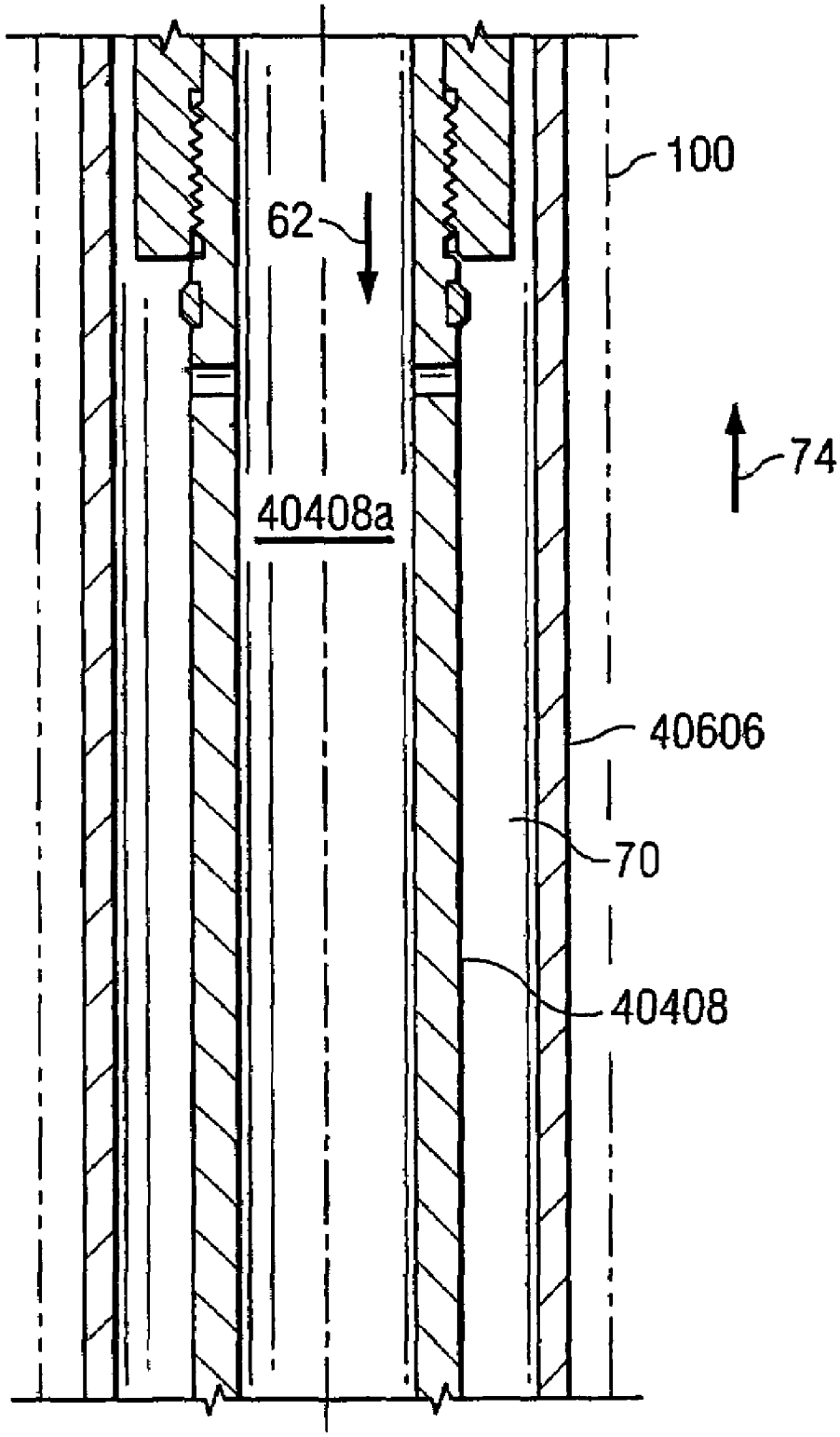
Figure 41R:
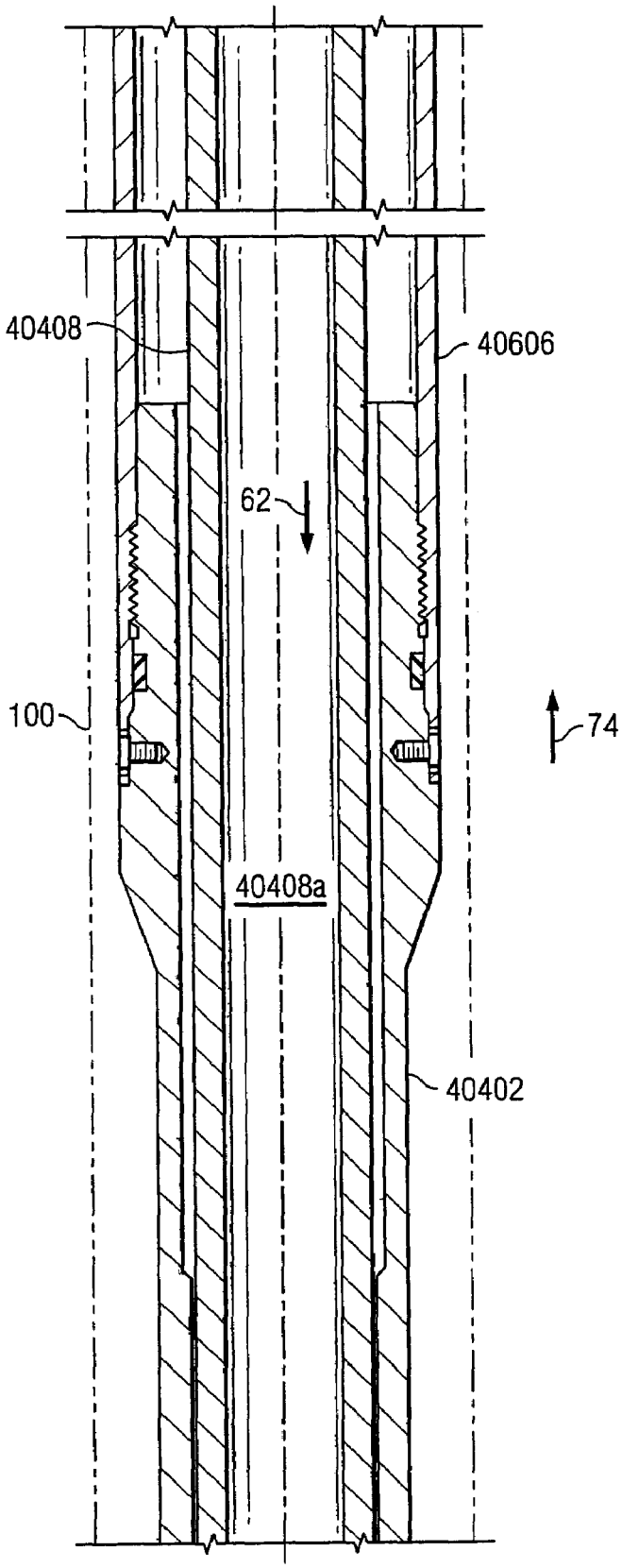
Figure 41S:
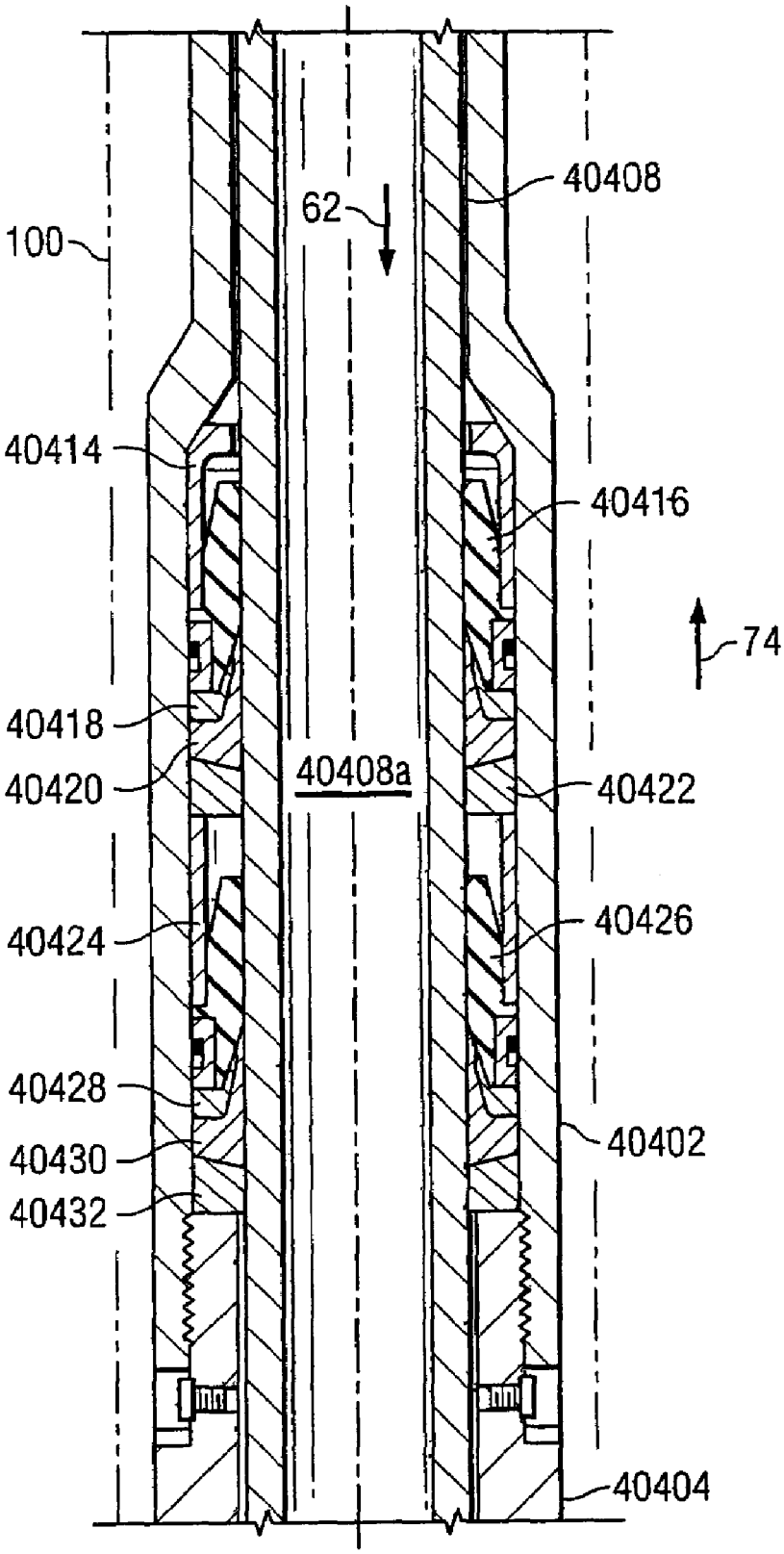
Figure 41T:
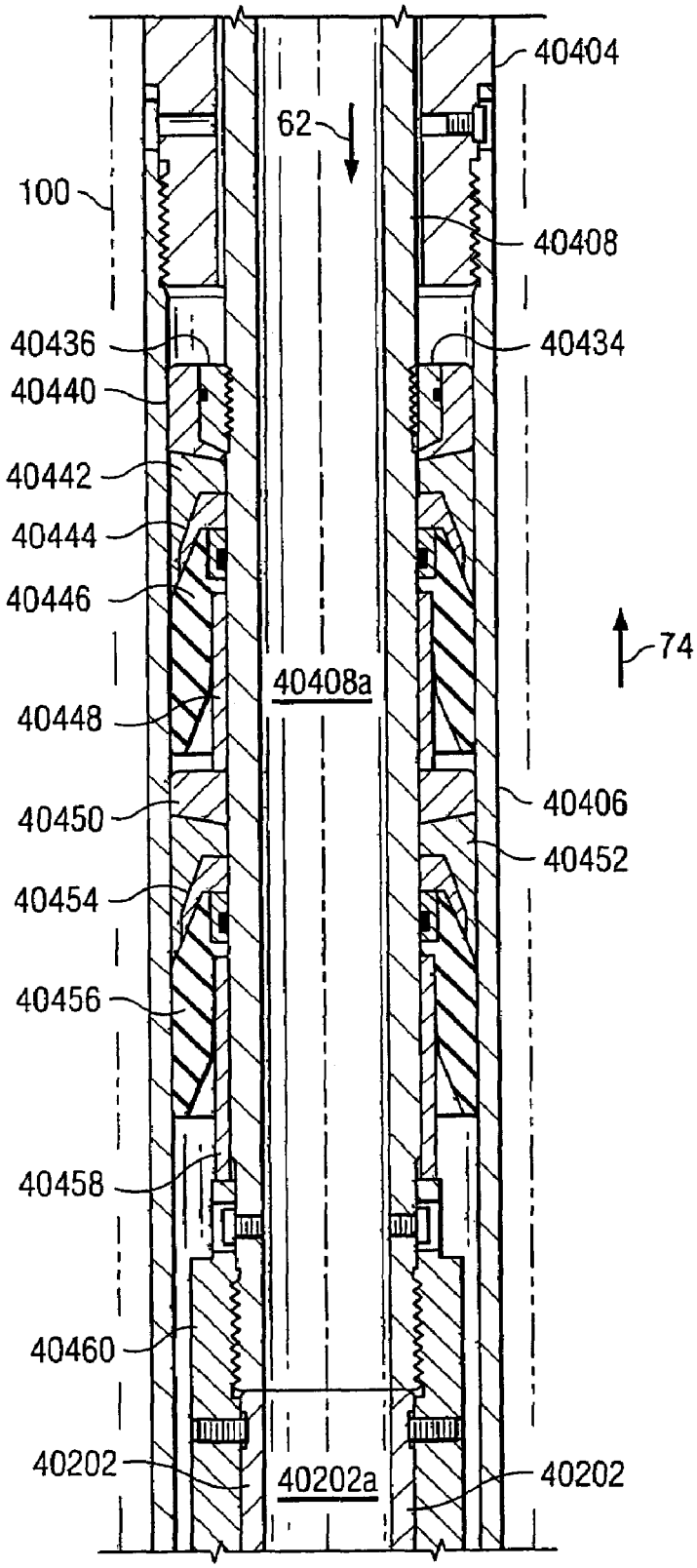
Figure 41U:
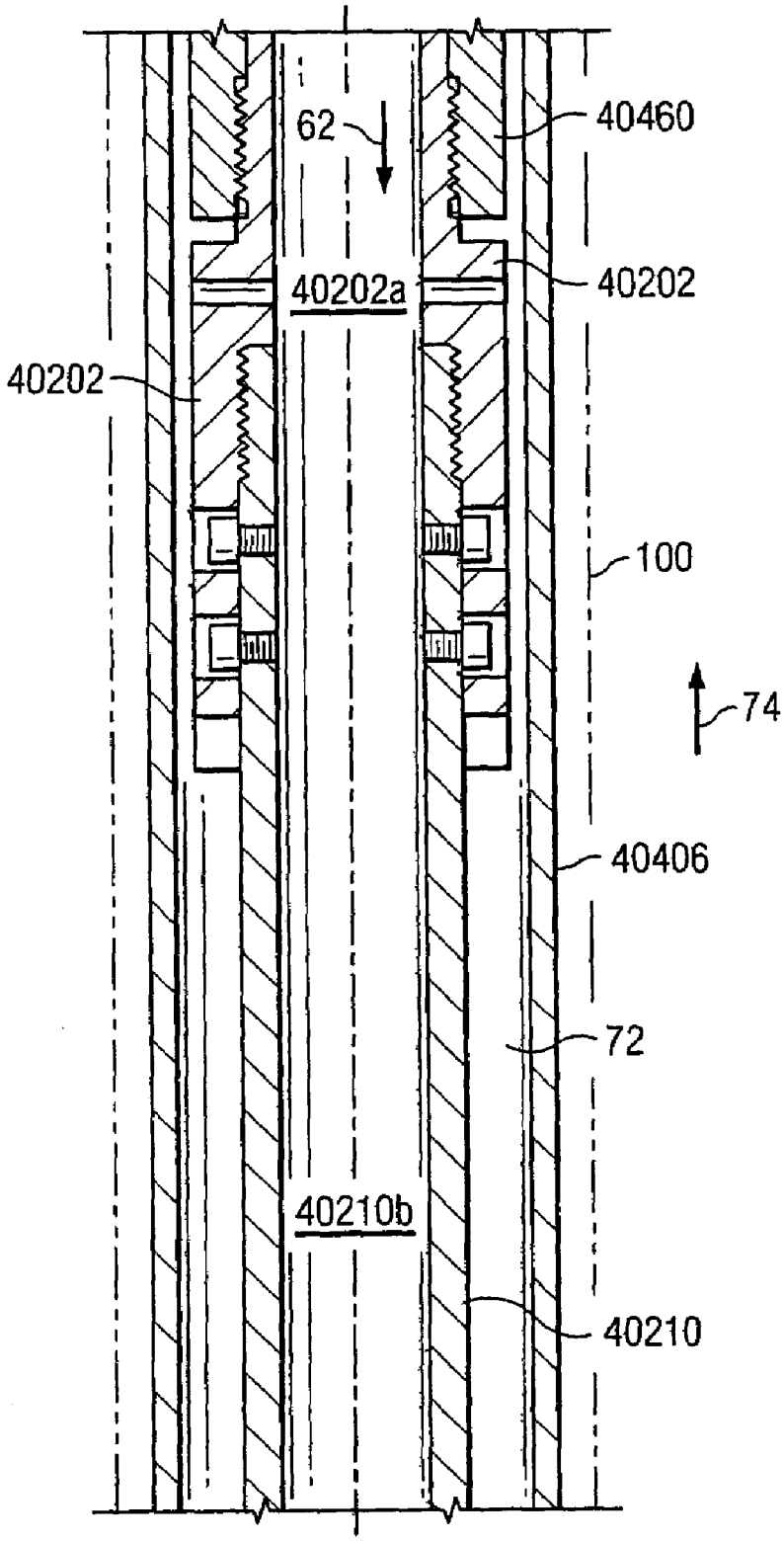
Figure 41V:
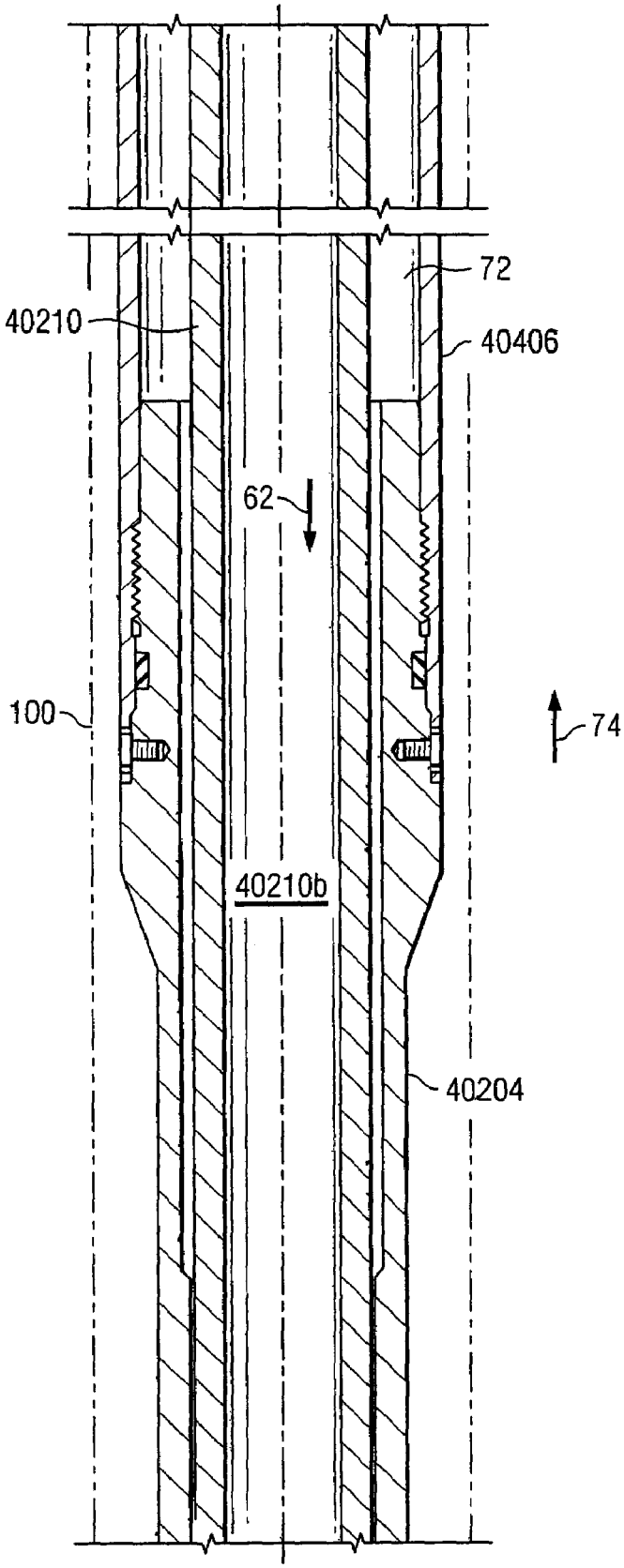
Figure 41W:
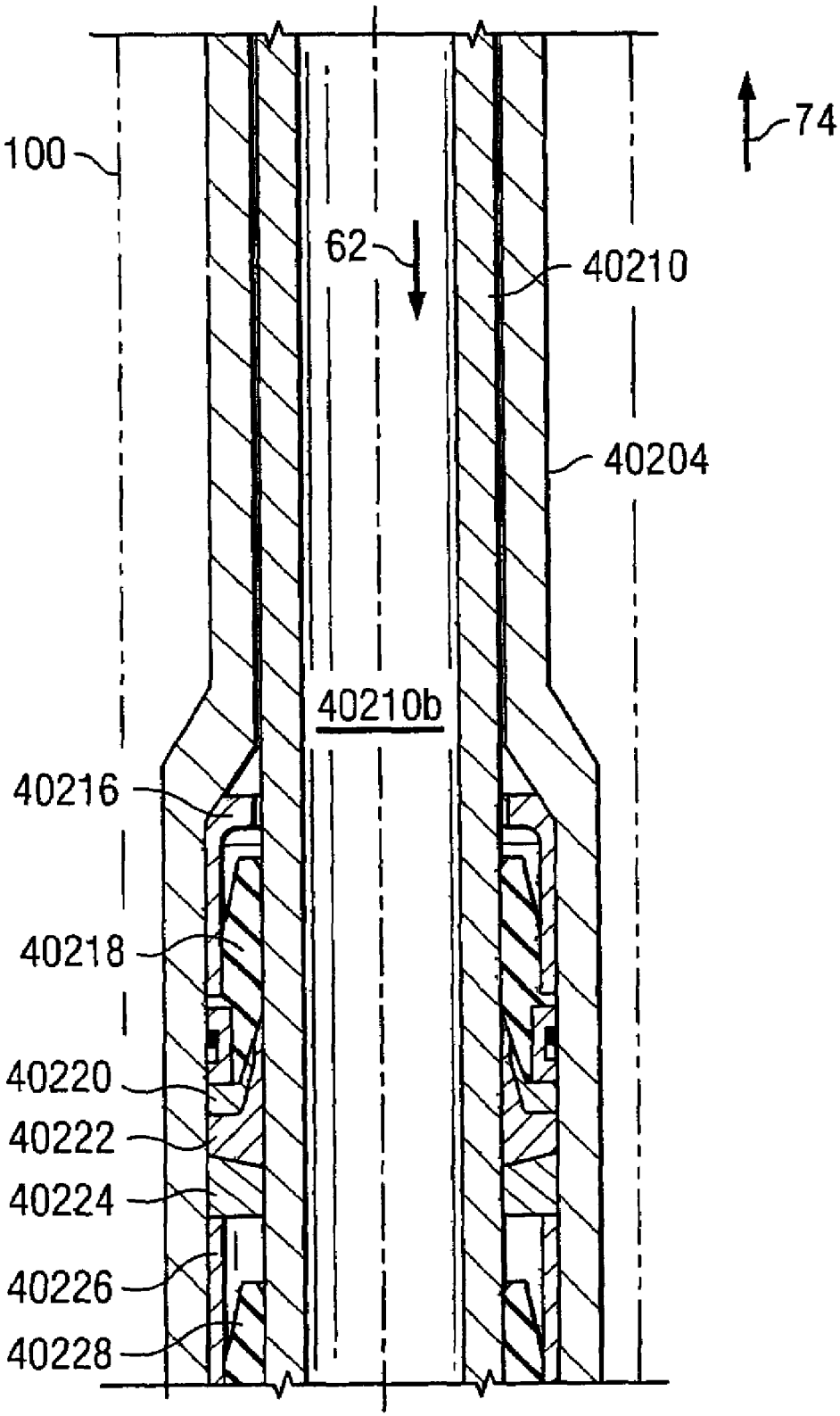
Figure 41X:
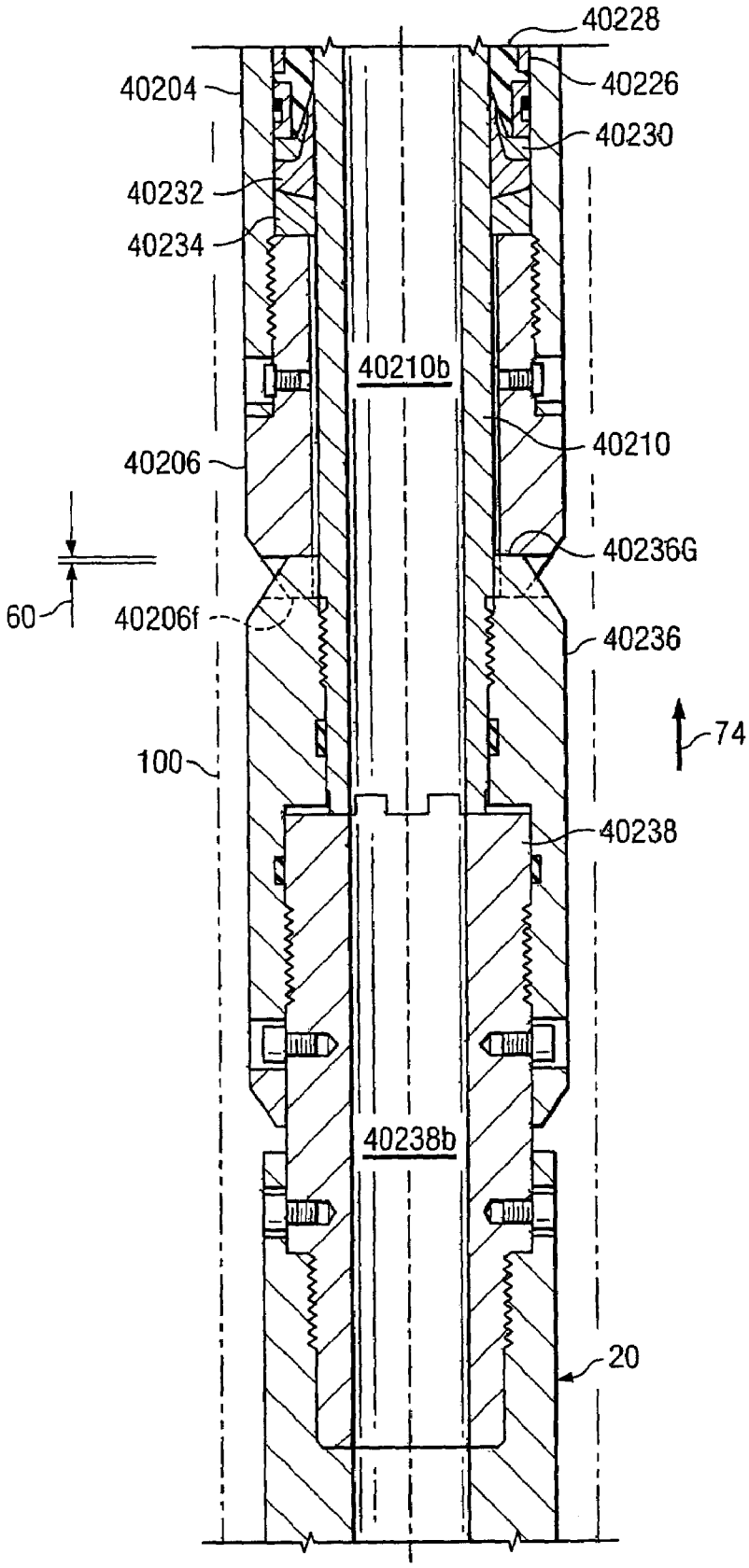

In an exemplary embodiment, as illustrated in FIGS. 41A through 41X, the operating pressure of the fluidic material 62 may then be increased by, for example, controllably blocking or limiting the flow of the fluidic material 62 through the passage 40238*b* and/or increasing the operating pressure of the outlet of a pumping device for injecting the fluidic material 62 into the tension actuator assembly 40. In an exemplary embodiment, one or more plug elements or operating plugs such as, for example, the plug 36104, may be injected into the tension actuator assembly 40 and through the passages 401404*b*, 401402*a*, 401266*b*, 401208*a*, 401008*a*, 40808*a*, 40608*a*, 40408*a*, 40202*a*, 40210*b* and 40238*b*, and the internal tapered surface 401266*c* of the guide 401266 may facilitate the guiding of the plug 36104 into the passage 401208*a* of the connecting rod 401208.

As a result of the increased operating pressure of the fluidic material 62, the operating pressure within each of the annular regions 64, 66, 68, 70 and 72 is increased so that the total of the forces generated within each of the annular regions is sufficient to displace the guide 401266, the connecting rod 401208, the retaining dogs 401234 and 401236, the upper thimble 401240, the backup ring 401242, the inside thimble 401244, the cup 401246, the sleeve 401248, the outside thimble 401250, the backup ring 401252, the inside thimble 401254, the cup 401256, the tubular sleeve 401258 and the collar 401260 of the upper subassembly 401200 in an upward direction 74. During this displacement, the upper lift adapter 401202, the retainer 401204, the barrel 401206, the upper sleeve 401214, the cup 401216, the inside thimble 401218, the backup ring 401220, the outside thimble 401222, the sleeve 401222, the cup 401226, the inside thimble 401228, the backup ring 401230 and the outside thimble 401232 remain stationary, the volumetric space or size of the annular region 64 increases, the cups 401216 and 401226 continue to sealingly engage the outside surface of the connecting rod 401208, and the cups 401246 and 401256 continue to sealingly engage the inside surface of the barrel 401206.

Moreover, the connecting rod 401008, the retaining dogs 401034 and 401036, the upper thimble 401040, the backup ring 401042, the inside thimble 401044, the cup 401046, the sleeve 401048, the outside thimble 401050, the backup ring 401052, the inside thimble 401054, the cup 401056, the tubular sleeve 401058 and the coupling 401060 of the middle subassembly 40100 are also displaced in the upward direction 74. During this displacement, the middle lift adapter 401002, the retainer 401004, the barrel 401006, the upper sleeve 401014, the cup 401016, the inside thimble 401018, the backup ring 401020, the outside thimble 401022, the sleeve 401022, the cup 401026, the inside thimble 401028, the backup ring 401030 and the outside thimble 401032 remain stationary, the volumetric space or size of the annular region 64 increases as noted above, the cups 401016 and 401026 continue to sealingly engage the outside surface of the connecting rod 401008, and the cups 401046 and 401056 continue to sealingly engage the inside surface of the barrel 401006.

Moreover, the connecting rod 40808, the retaining dogs 40834 and 40836, the upper thimble 40840, the backup ring 40842, the inside thimble 40844, the cup 40846, the sleeve 40848, the outside thimble 40850, the backup ring 40852, the inside thimble 40854, the cup 40856, the tubular sleeve 40858 and the coupling 40860 of the middle subassembly 40800 are also displaced in the upward direction 74. During this displacement, the middle lift adapter 40802, the retainer 40804, the barrel 40806, the upper sleeve 40814, the cup 40816, the inside thimble 40818, the backup ring 40820, the outside thimble 40822, the sleeve 40822, the cup 40826, the inside thimble 40828, the backup ring 40830 and the outside thimble 40832 remain stationary, the volumetric space or size of the annular region 66 increases, the cups 40816 and 40826 continue to sealingly engage the outside surface of the connecting rod 40808, and the cups 40846 and 40856 continue to sealingly engage the inside surface of the barrel 40806.

Moreover, the connecting rod 40608, the retaining dogs 40634 and 40636, the upper thimble 40640, the backup ring 40642, the inside thimble 40644, the cup 40646, the sleeve 40648, the outside thimble 40650, the backup ring 40652, the inside thimble 40654, the cup 40656, the tubular sleeve 40658 and the coupling 40660 of the middle subassembly 40600 are also displaced in the upward direction 74. During this displacement, the middle lift adapter 40602, the retainer 40604, the barrel 40606, the upper sleeve 40614, the cup 40616, the inside thimble 40618, the backup ring 40620, the outside thimble 40622, the sleeve 40622, the cup 40626, the inside thimble 40628, the backup ring 40630 and the outside thimble 40632 remain stationary, the volumetric space or size of the annular region 68 increases, the cups 40616 and 40626 continue to sealingly engage the outside surface of the connecting rod 40608, and the cups 40646 and 40656 continue to sealingly engage the inside surface of the barrel 40606.

Moreover, the connecting rod 40408, the retaining dogs 40434 and 40436, the upper thimble 40440, the backup ring 40442, the inside thimble 40444, the cup 40446, the sleeve 40448, the outside thimble 40450, the backup ring 40452, the inside thimble 40454, the cup 40456, the tubular sleeve 40458 and the coupling 40460 of the middle subassembly 40400 are also displaced in the upward direction 74. During this displacement, the middle lift adapter 40402, the retainer 40404, the barrel 40406, the upper sleeve 40414, the cup 40416, the inside thimble 40418, the backup ring 40420, the outside thimble 40422, the sleeve 40422, the cup 40426, the inside thimble 40428, the backup ring 40430 and the outside thimble 40432 remain stationary, the volumetric space or size of the annular region 70 increases, the cups 40416 and 40426 continue to sealingly engage the outside surface of the connecting rod 40408, and the cups 40446 and 40456 continue to sealingly engage the inside surface of the barrel 40406.

Moreover, the adapter 40202, the connecting rod 40210, the coupling 40236 and the lower nipple 40238 of the lower subassembly 40200 are also displaced in the upward direction 74. During this displacement, the lower lift adapter 40204, the upper sleeve 40216, the cup 40218, the inside thimble 40220, the backup ring 40222, the outside thimble 40224, the sleeve 40226, the cup 40228, the inside thimble 40230, the backup ring 40232, the outside thimble 40234 and the torque retainer 40206 remain stationary, the volumetric space or size of the annular region 72 increases, and the cups 40218 and 40228 continue to sealingly engage the outside surface of the connecting rod 40210.

During the above-described displacement of several components of the tension actuator assembly 40 in the direction 74, an upward tensile force is applied to all elements of the system 10 coupled to and positioned below the lower nipple 40238. As a result, the expansion cone assembly 28 and/or 30 radially expands and plastically deforms at least a portion of the casing 100, in a manner of operation substantially similar to any of the manners of operation of the expansion cone assembly 28 and/or 30 described and/or referenced above, and/or any combination thereof.

As a result of the above-described displacement of several components of the tension actuator assembly 40 in the direction 74, the tension actuator assembly 40 is in a retracted configuration. In an exemplary embodiment, when the tension actuator assembly 40 is in a retracted configuration, the torque lugs 40206*f* engage and mesh with the torque lugs 40236*g*, and the respective values of the distances 58 and 60 are negligible, that is, equal to, or nearly equal to, zero. In an exemplary embodiment, when the distances 58 and 60 are each about equal to the other when the tension actuator assembly 40 is in the extended configuration, and when the distances 58 and 60 are each negligible when the tension actuator assembly 40 is in the retracted configuration, the distances 58 and 60 are each about equal to the stroke length of the tension actuator assembly 40 when the tension actuator assembly 40 is in the extended configuration; that is, the stroke length of the tension actuator assembly 40 is about equal to the overall axial distance that each of the connecting rods 401208, 401008, 40808, 40608, 40408 and 40210 travels during the above-described displacement of several components of the tension actuator assembly 40 in the direction 74.

In an exemplary embodiment, the stroke length of the tension actuator assembly 40 may be about 35 feet. In several exemplary embodiments, the casing 100 may be in the form of a wide variety of types and configurations of casing, including a wide variety of sizes of casing. In an exemplary embodiment, the casing 100 may be, for example, 7-⅝ inch casing. In an exemplary embodiment, the transportable length of each of the above-described subassemblies 40200, 40400, 40600, 40800, 401000, 401200 and 401400 in the tension actuator assembly 40 may be, for example, equal to or less than about 45 feet.

In an exemplary embodiment, the stroke length of the tension actuator assembly 40 may be increased by coupling, with flush joint connections, connecting-rod extensions and barrel extensions between, for example, the lower subassembly 40200 and the middle subassembly 40400, the middle subassembly 40400 and the middle subassembly 40600, the middle subassembly 40600 and the middle subassembly 40800, the middle subassembly 40800 and the middle subassembly 401000, and the middle subassembly 401000 and the upper subassembly 401200, of the tension actuator assembly 40. In an exemplary embodiment, the stroke length of the tension actuator assembly 40 may be increased up to, for example, 90 feet. In an exemplary embodiment, a connecting-rod extension may be coupled to the lower connecting rod 40210 of the lower subassembly 40200, a connecting-rod extension may be coupled to each of the connecting rods 40408, 40608, 40808 and 401008, a barrel extension may be coupled to each of the barrels 40406, 40606, 40806 and 401006, and a barrel extension may be coupled to the barrel 401206. In an exemplary embodiment, the stroke length of the tension actuator assembly 40 may be increased up to, for example, 90 feet, while the transportable length of each of the above-described subassemblies 40200, 40400, 40600, 40800, 401000, 401200 and 401400 in the tension actuator assembly 40 may be, for example, equal to or less than about 45 feet.

When the tension actuator assembly 40 is in its retracted configuration, the engagement and meshing of the torque lugs 40206*f* with the torque lugs 40236*g* permits torque to be transmitted through the tension actuator assembly 40. For example, torque may be applied to the top subassembly 401400, thereby transmitting torque through the upper lift adapter 401202, the retainer 401204 and the barrel 401206 of the upper subassembly 401200; the middle lift adapters 401002, 40802, 40602 and 40402 of the middle subassemblies 401000, 40800, 40600 and 40400, respectively; the retainers 401004, 40804, 40604 and 40404 of the middle subassemblies 401000, 40800, 40600 and 40400, respectively; the barrels 401006, 40806, 40606 and 40406 of the middle subassemblies 401000, 40800, 40600 and 40400, respectively; and the lower lift adapter 40204 and the torque retainer 40206 of the lower subassembly 40200, due to the above-described couplings between these elements, and the torque is transmitted from the torque retainer 40206 to the coupling 40236 via the engagement and meshing of the torque lugs 40206*f* with the torque lugs 40236*g*. As a result, the torque is transmitted from the coupling 40236 to one or more elements of the system 10 coupled to and positioned below the lower nipple 40238 via the above-described coupling between the coupling 40236 and the lower nipple 40238. The torque may also be transmitted from the coupling 40236 to the lower connecting rod 40210 via the above-described coupling between the coupling 40236 and the lower connecting rod 40210.

In an exemplary embodiment, after the tension actuator assembly 40 has been placed in its retracted configuration from its extended configuration, thereby causing radial expansion and plastic deformation of the casing 100 as described above, the ball gripper assembly 16 may then be operated to release the casing 100, and the tubular support 12 may be moved upwardly to permit the tension actuator assembly 40 to again be placed in its extended configuration. The above-described operation of the tension actuator assembly 40 may then be repeated to radially expand and plastically deform at least another portion of the casing 100. As a result, in an exemplary embodiment, the casing 100 may be radially expanded and plastically deformed without subjecting the casing 100 to the increased operating pressure of the fluidic material 62, and/or the increased operating pressure within each of the annular regions 64, 66, 68, 70 and 72. As a result, in an exemplary embodiment, the casing 100 may be generally prevented from bursting in response to the increased operating pressure of the fluidic material 62, and/or the increased operating pressure within each of the annular regions 64, 66, 68, 70 and 72, especially if the increased operating pressure of the fluidic material 62, and/or the increased operating pressure within each of the annular regions 64, 66, 68, 70 and 72, is higher than the burst pressure of the casing 100 and/or is higher than the pressure rating of the casing connections in the casing 100. As another result, in an exemplary embodiment, the radial expansion and plastic deformation of the casing 100 does not require the casing 100 to maintain pressure integrity. That is, the tension actuator assembly 40 may be operated to radially expand and plastically deform the casing 100 even if the casing 100 has lost pressure integrity, or has negligible pressure integrity, due to, for example, one or more holes or openings in the casing 100, one or more parted portions of the casing 100 and/or other causes.

In several exemplary embodiments, during the operation of the tension actuator assembly 40, the ball gripper assembly 16 may or may not be operated to engage the casing 100. In several exemplary embodiments, slips may be substituted for the ball gripper assembly 16.

In several exemplary embodiments, during the operation of the tension actuator assembly 40 and, in particular, the placement of the tension actuator assembly 40 in its retracted configuration from its extended configuration, the use of the above-described cups 401246 and 401256, 401046 and 401056, 40846 and 40856, 40646 and 40656, and 40446 and 40456, to sealingly engage the inside surfaces of the barrels 401206, 401006, 40806, 40606 and 40406, respectively, permits the use of a non-machined finish on these inside surfaces with no special coatings. In an exemplary embodiment, in addition to, or instead of the cups 401246 and 401256, 401046 and 401056, 40846 and 40856, 40646 and 40656, and 40446 and 40456, other seal systems such as, for example, V-packing, may be used when, for example, the inside surfaces of the barrels 401206, 401006, 40806, 40606 and 40406 are machined to a seal finish and/or are coated or plated with an abrasion-resistant material.

In several exemplary embodiments, during the operation of the tension actuator assembly 40 and, in particular, the placement of the tension actuator assembly 40 in its retracted configuration from its extended configuration, the use of the above-described cups 401216 and 401226, 401016 and 401026, 40816 and 40826, 40616 and 40626, 40416 and 40426, and 40218 and 40228, to sealingly engage the outside surfaces of the connecting rods 401208, 401008, 40808, 40608, 40408 and 40210, respectively, permits the use of a non-machined finish on these outside surfaces with no special coatings. In an exemplary embodiment, in addition to, or instead of the cups 401216 and 401226, 401016 and 401026, 40816 and 40826, 40616 and 40626, 40416 and 40426, and 40218 and 40228, other seal systems such as, for example, V-packing, may be used when, for example, the outside surfaces of the connecting rods 401208, 401008, 40808, 40608, 40408 and 40210 are machined to a seal finish and/or are coated or plated with an abrasion-resistant material.

Figure 42A:
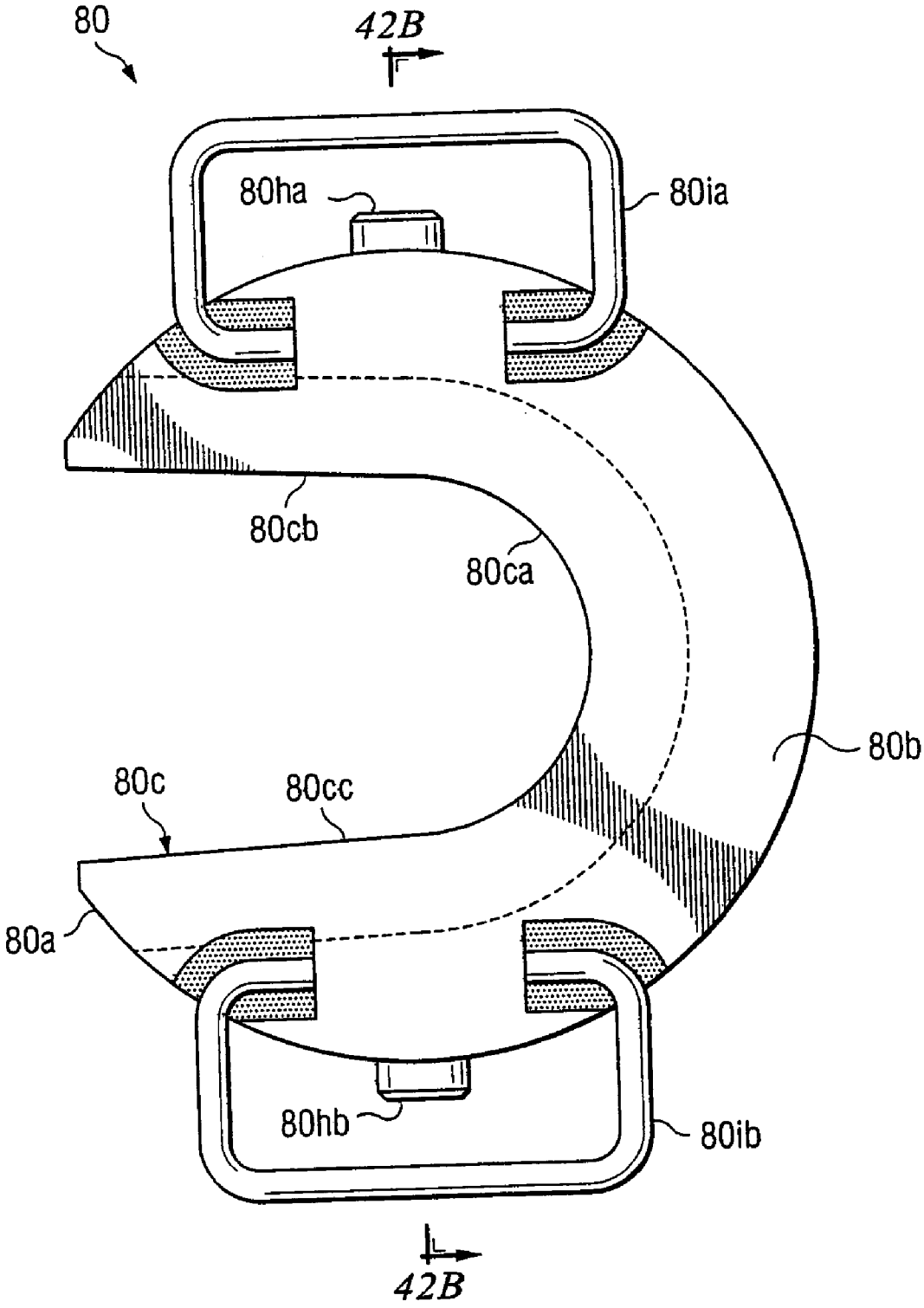
FIGS. 42A and 42B are respective elevational and cross-sectional views of an exemplary embodiment of a device adapted to be coupled to, for example, one or more subassemblies of the tension actuator assembly of FIG. 34.
Figure 42B:
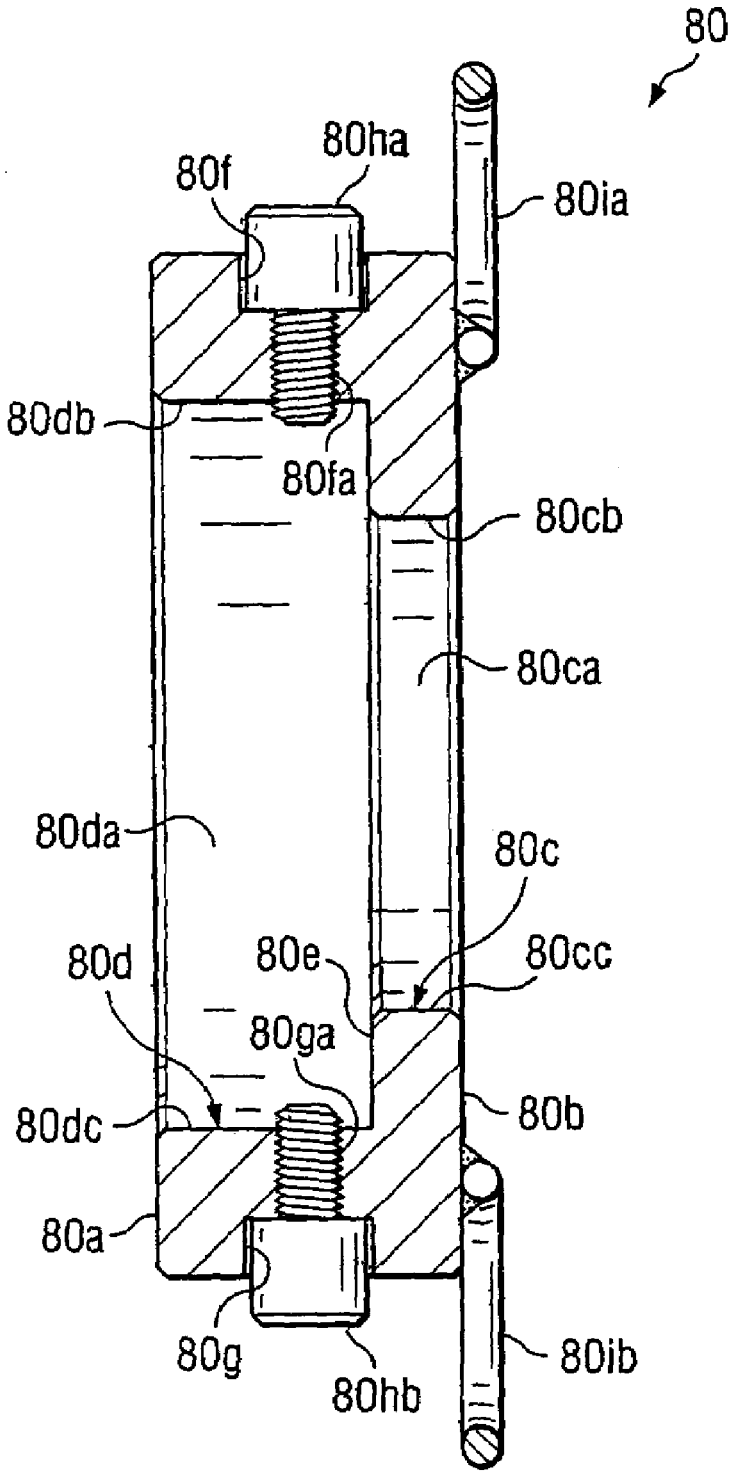

In an exemplary embodiment, as illustrated in FIGS. 42A and 42B, a device 80 includes a generally partially cylindrical body 80*a* defining an end surface 80*b*, and an opening 80*c* formed in the body 80*a* and defining an internal arcuate surface 80*ca* and parallel-spaced surfaces 80*cb* and 80*cc* extending from the internal arcuate surface 80*ca*. An internal recess 80*d* is formed in the body 80*a* and defines an internal arcuate surface 80*da* and parallel-spaced surfaces 80*db* and 80*dc* extending from the internal arcuate surface 80*da*, and further defines an internal shoulder 80*e*. Circumferentially-spaced and aligned counterbores 80*f* and 80*g* having internal threaded connections 80*fa* and 80*ga*, respectively, extend through the body 80*a*, and set screws 80*ha* and 80*hb* extend through the counterbores 80*f* and 80*f*, respectively, and threadably engage the internal threaded connections 80*fa* and 80*fg*, respectively. Handles 80*ia* and 80*ib* are connected to the surface 80*b*. In an exemplary embodiment, the handles 80*i* and 80*ib* may each be connected to the surface 80*b* via one or more weld joints.

Figure 43:
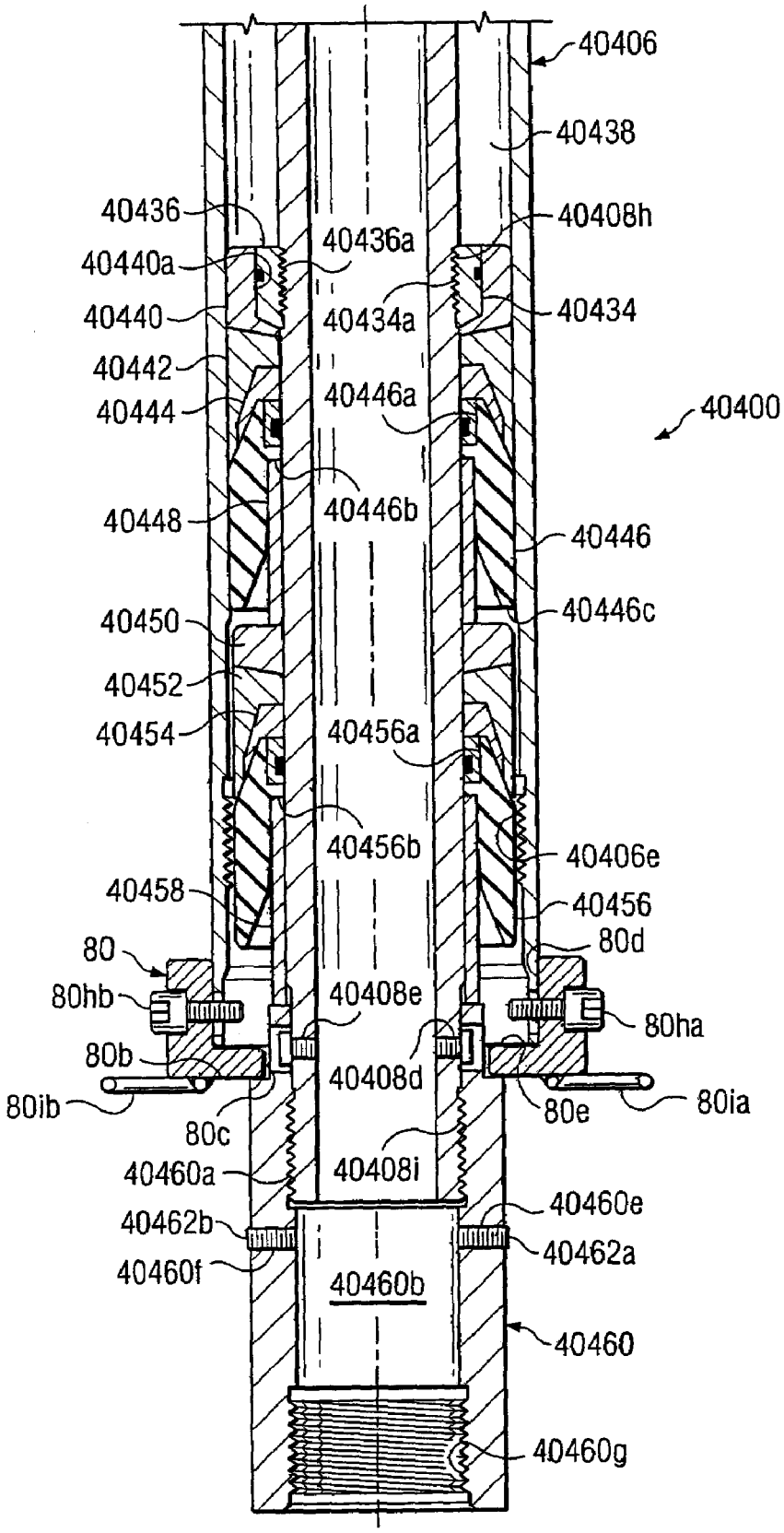
FIG. 43 is a cross-sectional illustration of the exemplary embodiment of the device of FIGS. 42A and 42B coupled to the middle subassembly of FIGS. 36A to 36C.

In an exemplary embodiment, as illustrated in FIG. 43, the device 80 may be coupled to the middle subassembly 40400. When the device 80 is coupled to the middle subassembly 40400, the device 80 is positioned so that the barrel 40406 at least partially extends within the internal recess 80*d* of the device 80, and the coupling 40460 at least partially extends within the opening 80*c*. As a result, the internal shoulder 80*e* is adjacent the barrel 40406 and the surface 80*b* is adjacent the coupling 40460. The set screws 80*ha* and 80*hb* extend through the radial openings 40406*f* and 40406*g*, respectively, of the barrel 40406, thereby holding the device 80 in place.

In several exemplary embodiments, the device 80 may be coupled to each of the middle subassemblies 40600, 40800 and 40100 in a manner identical to the manner in which the device 80 is coupled to the middle subassembly 40400, as described above.

Figure 44:
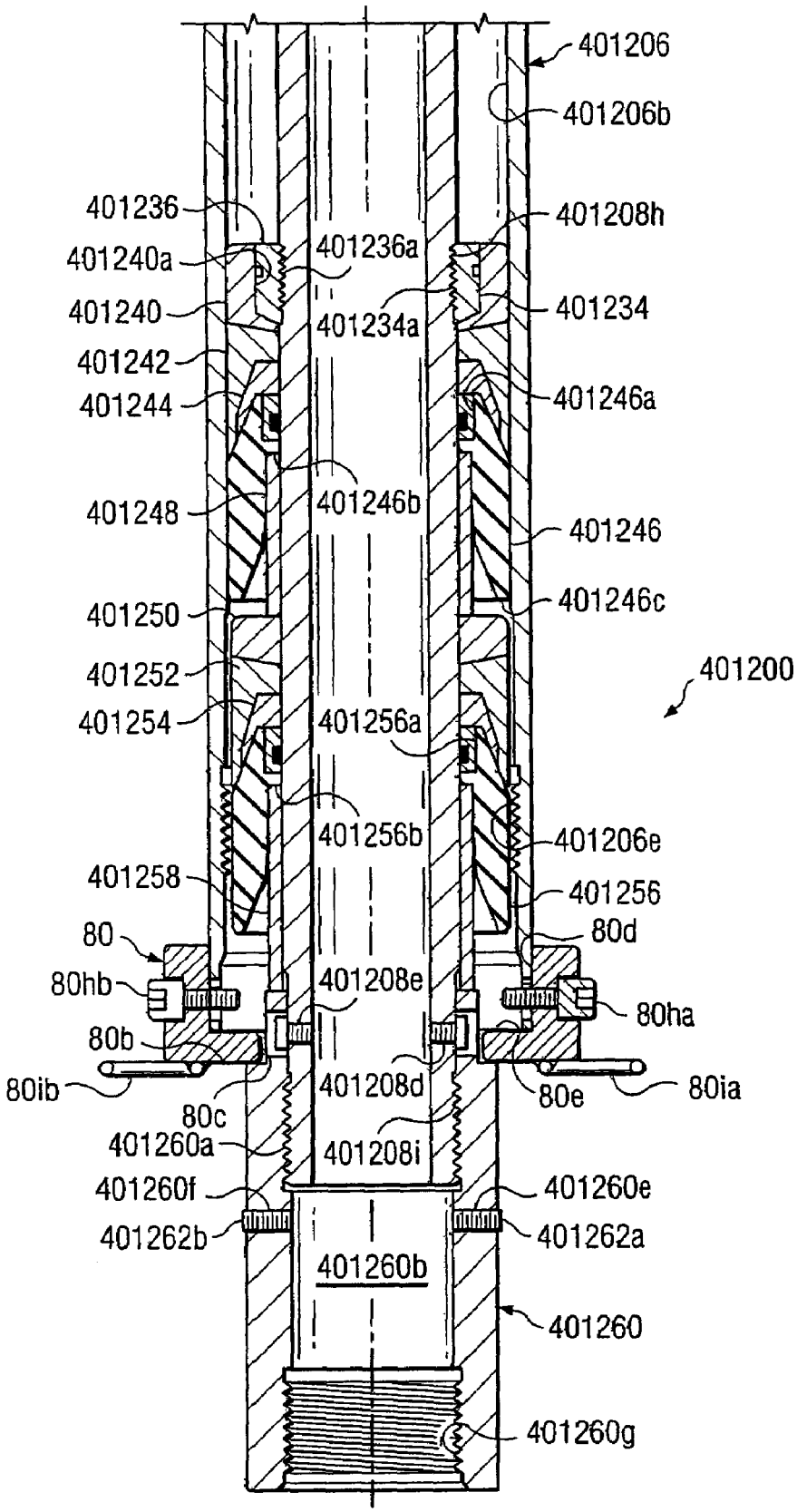
FIG. 44 is a cross-sectional illustration of the exemplary embodiment of the device of FIGS. 42A and 42B coupled to the upper subassembly of FIGS. 37A to 37C.

In an exemplary embodiment, as illustrated in FIG. 44, the device 80 may be coupled to the upper subassembly 401200. When the device 80 is coupled to the upper subassembly 401200, the device 80 is positioned so that the barrel 401206 at least partially extends within the internal recess 80*d* of the device 80, and the collar 401260 at least partially extends within the opening 80*c*. As a result, the internal shoulder 80*e* is adjacent the barrel 401260 and the surface 80*b* is adjacent the collar 401260. The set screws 80*ha* and 80*h* b extend through the radial openings 401206*f* and 401206*g*, respectively, of the barrel 401206, thereby holding the device 80 in place.

In an exemplary embodiment, the lower subassembly 40200, the middle subassemblies 40400, 40600, 40800 and 401000, the upper subassembly 401200 and the top subassembly 401400 may each be transported to the vicinity of the wellbore 102 by, for example, a truck, and may then be coupled together in the above-described manner on, for example, a rig floor.

In an exemplary embodiment, the tension actuator assembly 40 may be positioned in the casing 100, in order to operate the tension actuator assembly 40 as described above, by first running the lower subassembly 40200 in the wellbore 102. The middle subassembly 40400 is then coupled to the lower subassembly 40200. In an exemplary embodiment, the device 80 may be coupled to the middle subassembly 40400, in the manner described above, before the middle subassembly 40400 is coupled to the lower subassembly 40200. As a result, the device 80 is held in place, relative to the barrel 40406 of the middle subassembly 40400, and serves as a safety device, preventing the middle lift adapter 40402, the retainer 40404 and the barrel 40406 from accidentally moving downward during the coupling of the middle subassembly 40400 to the lower subassembly 40200, and/or the coupling of any one or more elements of the system 10 positioned below the middle subassembly 40400 to any one or more other elements of the system 10 positioned below the middle subassembly 40400. The device 80 is decoupled from the middle subassembly 40400 during or after the middle subassembly 40400 is coupled to the lower subassembly 40200.

The middle lift adapter 40402, the retainer 40404 and the barrel 40406 of the middle subassembly 40400 are then lowered, and the middle subassembly 40600 is coupled to the middle subassembly 40400. In an exemplary embodiment, the device 80 may be coupled to the middle subassembly 40600, in the manner described above, before the middle subassembly 40600 is coupled to the middle subassembly 40400. As a result, the device 80 is held in place, relative to the barrel 40606 of the middle subassembly 40600, and serves as a safety device, preventing the middle lift adapter 40602, the retainer 40604 and the barrel 40606 from accidentally moving downward during the coupling of the middle subassembly 40600 to the middle subassembly 40400, and/or the coupling of any one or more elements of the system 10 positioned below the middle subassembly 40600 to any one or more other elements of the system 10 positioned below the middle subassembly 40600. The device 80 is decoupled from the middle subassembly 40600 during or after the middle subassembly 40600 is coupled to the middle subassembly 40400. The middle subassembly 40400 is lowered into the wellbore 102.

The middle lift adapter 40602, the retainer 40604 and the barrel 40606 of the middle subassembly 40600 are then lowered, and the middle subassembly 40800 is coupled to the middle subassembly 40600. In an exemplary embodiment, the device 80 may be coupled to the middle subassembly 40800, in the manner described above, before the middle subassembly 40800 is coupled to the middle subassembly 40600. As a result, the device 80 is held in place, relative to the barrel 40806 of the middle subassembly 40800, and serves as a safety device, preventing the middle lift adapter 40802, the retainer 40804 and the barrel 40806 from accidentally moving downward during the coupling of the middle subassembly 40800 to the middle subassembly 40600, and/or the coupling of any one or more elements of the system 10 positioned below the middle subassembly 40800 to any one or more other elements of the system 10 positioned below the middle subassembly 40800. The device 80 is decoupled from the middle subassembly 40800 during or after the middle subassembly 40800 is coupled to the middle subassembly 40600. The middle subassembly 40600 is lowered into the wellbore 102.

The middle subassembly 401000 is coupled to the middle subassembly 40800, and the middle subassembly 40800 is lowered into the wellbore 102, in manners similar to the manners in which the middle subassembly 40800 is coupled to the middle subassembly 40600, and the middle subassembly 40600 is lowered into the wellbore 102, respectively, as described above. The upper subassembly 401200 is coupled to the middle subassembly 401000, and the middle subassembly 401000 is lowered into the wellbore 102, in manners similar to the manners in which the middle subassembly 40800 is coupled to the middle subassembly 40600, and the middle subassembly 40600 is lowered into the wellbore 102, respectively, as described above. The top subassembly 401400 is coupled to the upper subassembly 401200, and the upper subassembly 401200 is lowered into the wellbore 102. The top subassembly 401400 is lowered into the wellbore 102. As a result, the tension actuator assembly 40 is positioned in the casing 100.

In several exemplary embodiments, and instead of the above-described positioning procedure, the tension actuator assembly 40 may be positioned in the casing 100 using a wide variety of techniques, steps, procedures, and/or combinations thereof, including, for example, any positioning techniques, steps and/or procedures described and/or referenced above.

In an exemplary embodiment, another ball grabber assembly such as, for example, any of the ball grabber assemblies described and/or referenced above, and at least one other tension actuator assembly such as, for example, a tension actuator assembly similar to the tension actuator assembly 18, may be run between the tension actuator assembly 40 and the expansion cone assemblies 28 and/or 30. As a result, and during operation of the system 10, if the ball grabber assembly 16 above the tension actuator assembly 40 is positioned outside of the unexpanded portion of the casing 100 when, for example, the radial expansion and plastic deformation of the casing 100 is almost completed, and, as a result, the ball grabber assembly 16 is not able to operate in one or more of the manners described and/or referenced above, the at least one other tension actuator assembly may be operated to complete the radial expansion and plastic deformation of the casing 100.

Referring to FIG. 45, an exemplary embodiment of a system 4500 for radially expanding and plastically deforming a tubular member includes a safety sub 4502. An end of the safety sub 4502 is coupled to an end of a gripper assembly 4504 and another end of the gripper assembly is coupled to an end of a casing lock assembly 4506.

In an exemplary embodiment, the safety sub 4502 may include one or more elements of conventional safety subs that permit quick connection and/or disconnection of tubular members and/or the safety sub 20, or equivalents thereof.

In an exemplary embodiment, the gripper assembly 4504 may include one or more elements of conventional devices for gripping tubular members and/or the ball gripper assembly 16, or equivalents thereof.

Another end of the casing lock assembly 4506 is coupled to an end of a tension actuator assembly 4508, and another end of the tension actuator assembly 4508 is coupled to an end of an adjustable expansion device 4510.

In an exemplary embodiment, the casing lock assembly 4506 may include one or more elements of conventional casing lock assemblies that permit the position of a tubular member to be locked in position and/or the casing lock assembly 24, or equivalents thereof.

In an exemplary embodiment, the tension actuator assembly 4508 may include one or more elements of conventional actuating devices and/or the tension actuator assembly 18, or equivalents thereof.

Another end of the adjustable expansion device 4510 is coupled to an end of a float shoe assembly 4512.

In an exemplary embodiment, the adjustable expansion device 4510 may include one or more elements of conventional adjustable expansion devices, the adjustable expansion cone assemblies, 28 and 30, or equivalents thereof.

In an exemplary embodiment, the float shoe assembly 4512 may include one or more elements of conventional float shoe assemblies and/or the packer assembly 36, or equivalents thereof.

A wellbore casing assembly 4514 receives the safety sub 4502, the gripper assembly 4504, the casing lock assembly 4506, the tension actuator assembly 4508, and the adjustable expansion device 4510. In an exemplary embodiment, the wellbore casing 4514 is releasably coupled to the casing lock assembly 4506 and an end of the wellbore casing sealingly engages the float shoe assembly 4512.

Referring to FIGS. 45*a*, 45*b*, 45*c*, 45*d*, 45*e*, 45*f*, and 45*g*, in an exemplary embodiment, the adjustable expansion device 4510 includes a tubular support member 45100 that defines an internal passage 45100*a* and having an end that is coupled to an end of the tension actuator assembly 4508 and another end that includes an internal flange 45100*b* and an internal threaded connection 45100*c*.

An externally threaded end 45102*a* of a tubular support member 45102 that defines an internal passage 45102*b* is coupled to the internal threaded connection 45100*c* of the tubular support member 45100. The tubular support member 45102 further includes an internal flange 45102*c* and a tapered groove 45102*d* having an internal flange 45102*e* at another end of the tubular support member.

An actuator 45104 is positioned within the internal passage 45102*b* of the tubular support member 45102 between the internal flanges, 45100*b* and 45102*c*, of the tubular support members, 45100 and 45102, respectively. In an exemplary embodiment, the actuator 45104 may be, for example, a conventional hydraulically actuated device. In an exemplary embodiment, the actuator 45104 includes an internal passage that permits fluidic materials to be conveyed through the actuator thereby permitting fluidic materials to pass through the adjustable expansion device 4510.

An end of a tubular support member 45106 that defines an internal passage 45106*a* is coupled to the actuator 45104 and another end of the tubular support member includes a plurality of circumferentially spaced apart ramp members 45106*b* and is coupled to an end of the float shoe 4512. In this manner, the tubular support member 45106 may be displaced in an axial direction relative to the tubular support member 45100 by operation of the actuator 45104.

An expansion cone assembly 45108 is movably mounted upon the tubular support member 45106 that includes a plurality of circumferentially spaced apart expansion cone elements 45108*a* that are each coupled to a guide assembly 45108*b*.

In an exemplary embodiment, each of expansion cone elements 45108*a* include an end that defines an outer channel 45108*aa* that mates with and receives the internal flange 45102*e* of the tubular support member 45102. In this manner, the expansion cone elements 45108*a* may pivot with respect to the internal flange 45102*e* of the tubular support member 45102. Another end of each of the expansion cone elements 45108*a* include external surfaces, 45108*ab*, 45108*ac*, and 45108*ad*.

In an exemplary embodiment, the external surface 45108*ab* of the expansion cone elements 45108*a* are arcuate segments of a conical surface that increases in diameter in a direction 45108*ae*. In an exemplary embodiment, the external surface 45108*ac* of the expansion cone elements 45108*a* are arcuate segments of a cylindrical surface having a substantially constant diameter. In an exemplary embodiment, the external surface 45108*ad* of the expansion cone elements 45108*a* are arcuate segments of a conical surface that decreases in diameter in the direction 45018*ae*.

In an exemplary embodiment, the external surfaces, 45108*ab* and 45108*ac*, of each of the expansion cone elements 45108*a* include an insert 45108*af* that has increased surface hardness such as, for example, tungsten carbide, or equivalents thereof. In this manner, during operation of the system 4510, the expansion cone elements 45108*a* may engage and radially expand the wellbore casing assembly 4514 without excessive wear of the external surfaces, 45108*ab* and 45108*ac*, of the expansion cone elements.

In an exemplary embodiment, the guide assembly 45108*b* includes a retaining ring 45108*ba* that receives and is slidably mounted upon the external surface of the end of the tubular support member 45106. Extending from the retaining ring 45108*ba*, in a direction opposite the direction 45018*ae*, are a plurality of circumferentially spaced apart coupling elements 45108*bb* having ends that are coupled to ends of corresponding expansion cone elements 45018*a*. In an exemplary embodiment, the coupling elements 45108*bb* are interleaved with the circumferentially spaced apart ramp members 45106*b* of the tubular support member 45106. In this manner, the ends of the expansion cone elements 45018*a* are coupled to the retaining ring 45108*ba*.

In an exemplary embodiment, cup seals, 45110*a* and 45110*b*, are coupled to an external surface of the tubular support member 45100. In this manner, the interface between the tubular support member 45100 and the wellbore casing 4514 may be fluidicly sealed.

In an exemplary embodiment, during operation of the system 4510, when the tubular support member 45106 is displaced in a direction opposite the direction 45018*ae* relative to the tubular support members, 45100 and 45102, by operation of the actuator 45104, the expansion cone elements 45018*a* pivot in an outer radial direction relative to the tubular support member 45102 and are driven up the circumferentially spaced apart ramp members 45106*b* of the tubular support member 45106. As a result, in an exemplary embodiment, the retaining ring 45108*ba* and the circumferentially spaced apart coupling elements 45108*bb* are displaced in the direction 45018*ae* and the ends of the coupling elements that are coupled to the ends of the corresponding expansion cone elements 45018*a* are also displaced in a radial outer direction. As a result, in an exemplary embodiment, the circumferentially spaced apart coupling elements 45108*bb* are elastically deformed in an outer radial direction and the resulting spring force maintains the corresponding expansion cone elements 45018*a* in intimate contact with the corresponding circumferentially spaced apart ramp members 45106*b* of the tubular support member 45106.

In an exemplary embodiment, during operation of the system 4500, as illustrated in FIG. 45, the system 4500 is initially positioned within a wellbore 4516 that traverses a subterranean formation 4518.

Figure 46:
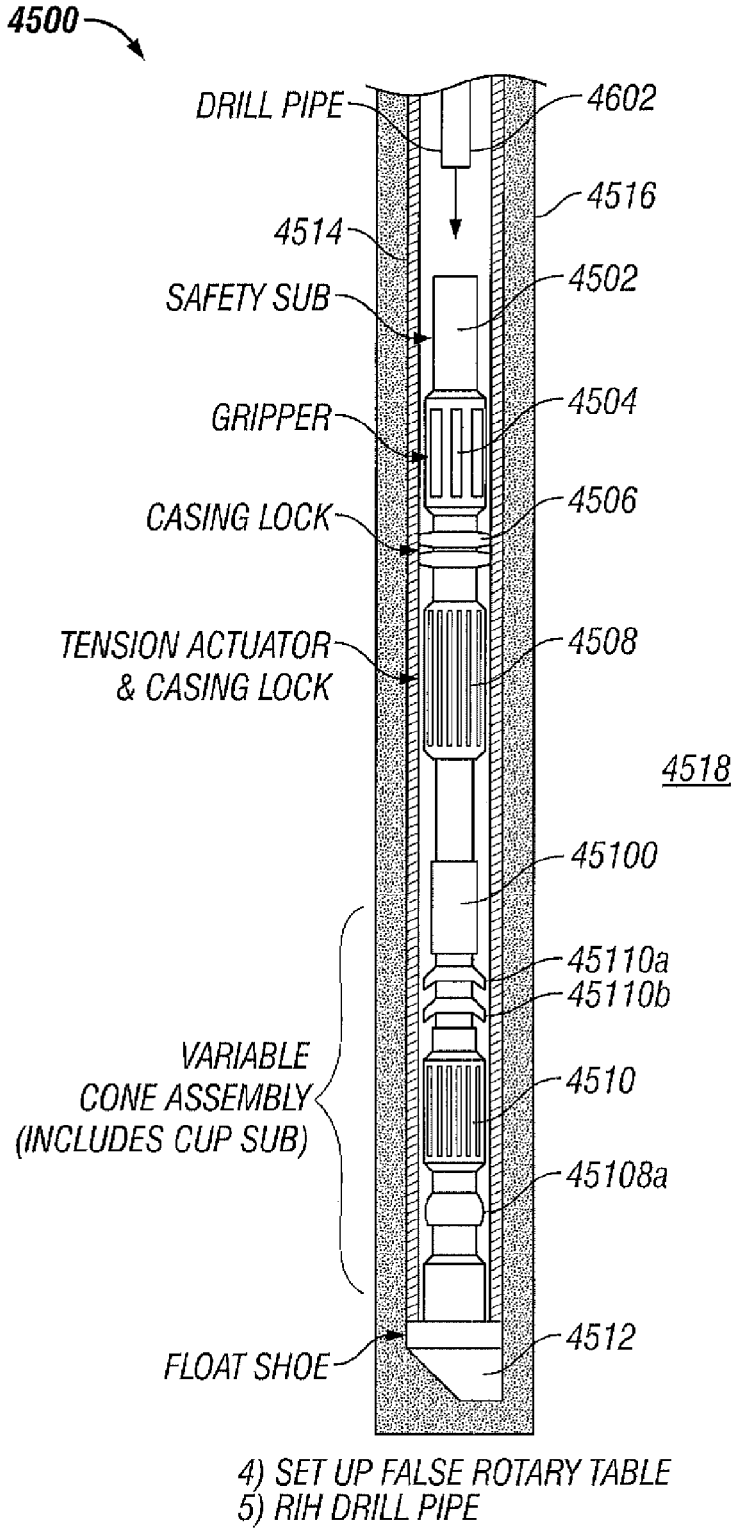
Figure 47:
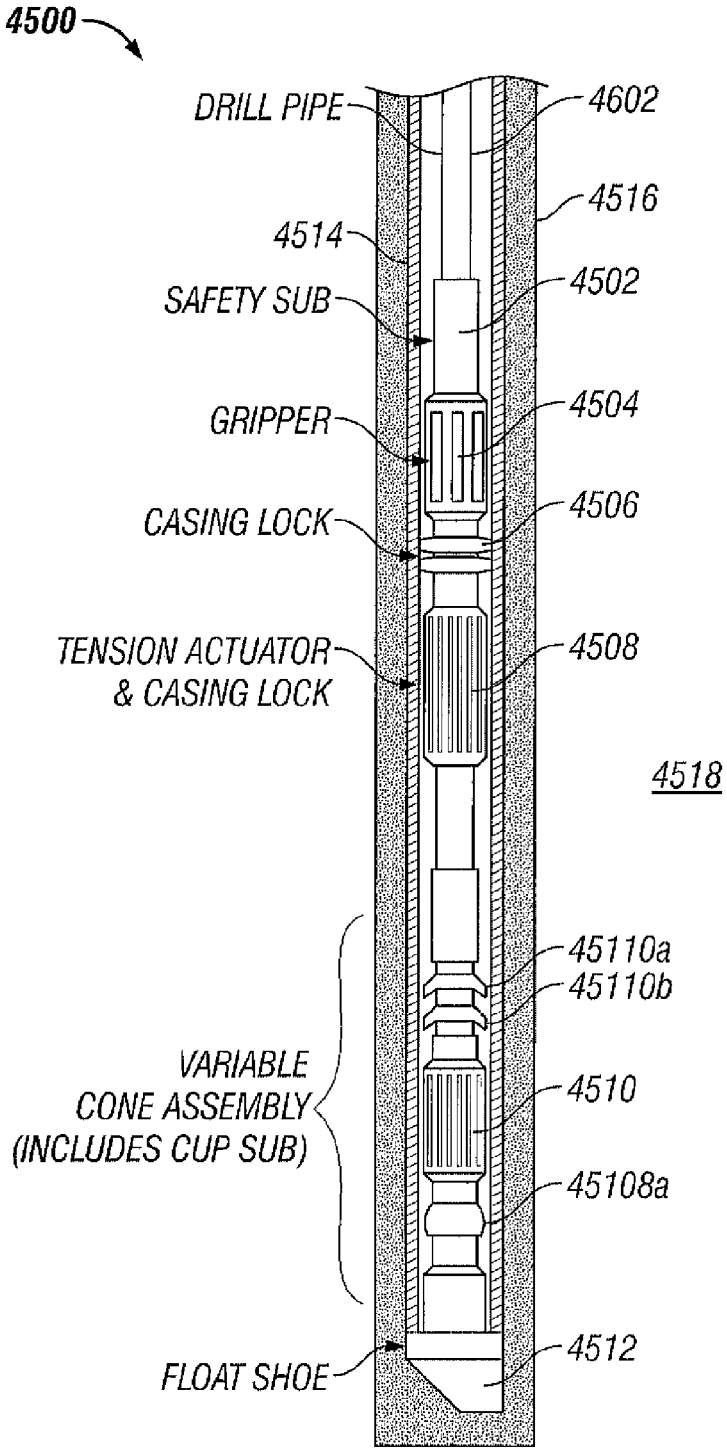

In an exemplary embodiment, during further operation of the system 4500, as illustrated in FIGS. 46 and 47, an end of a conventional drill pipe 4602 may then be coupled to an end of the safety sub 4502 of the system in a conventional manner.

Figure 48:
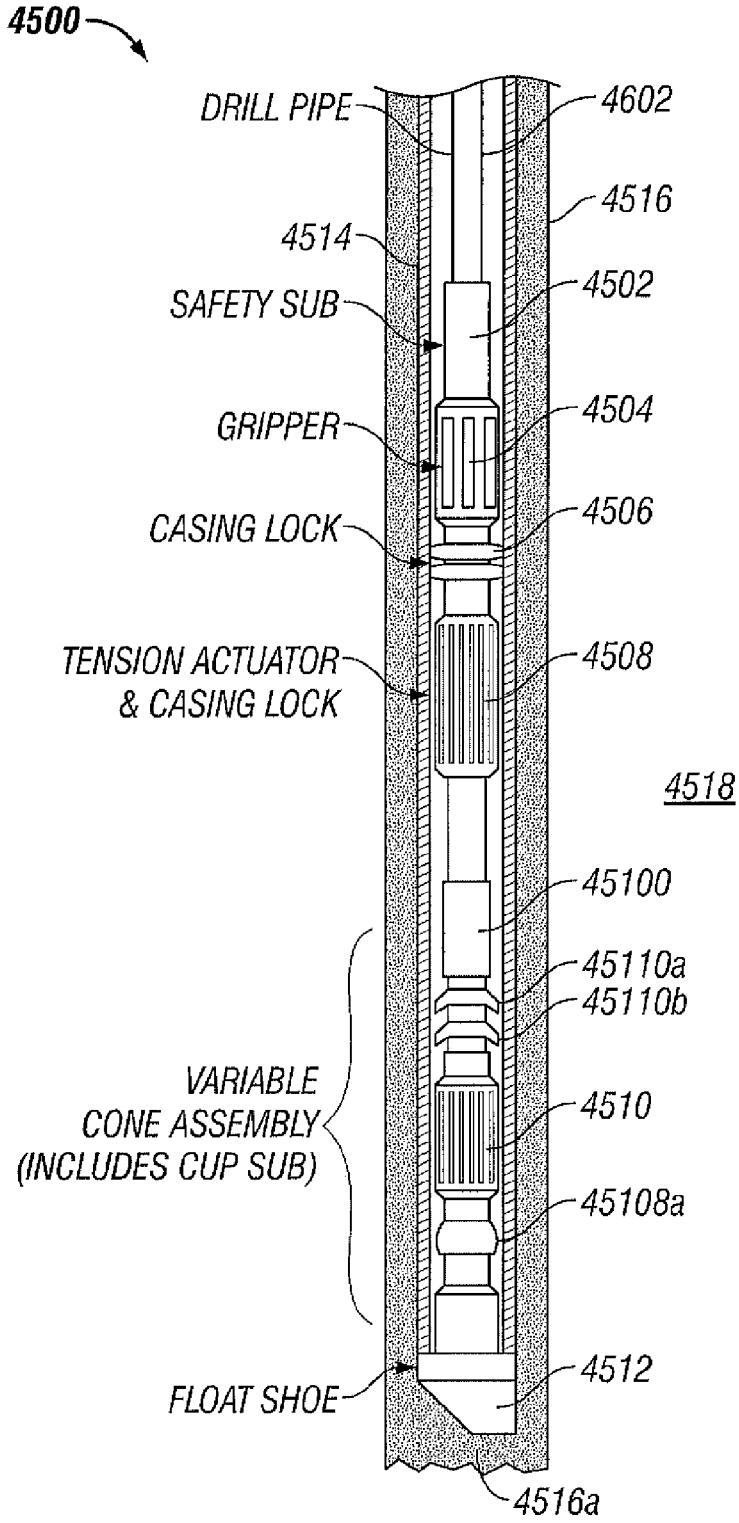

In an exemplary embodiment, during further operation of the system 4500, as illustrated in FIG. 48, the system is positioned within the wellbore 4516 until the end of the float shoe 4512 is positioned proximate a bottom end 4516*a* of the wellbore.

Figure 49:
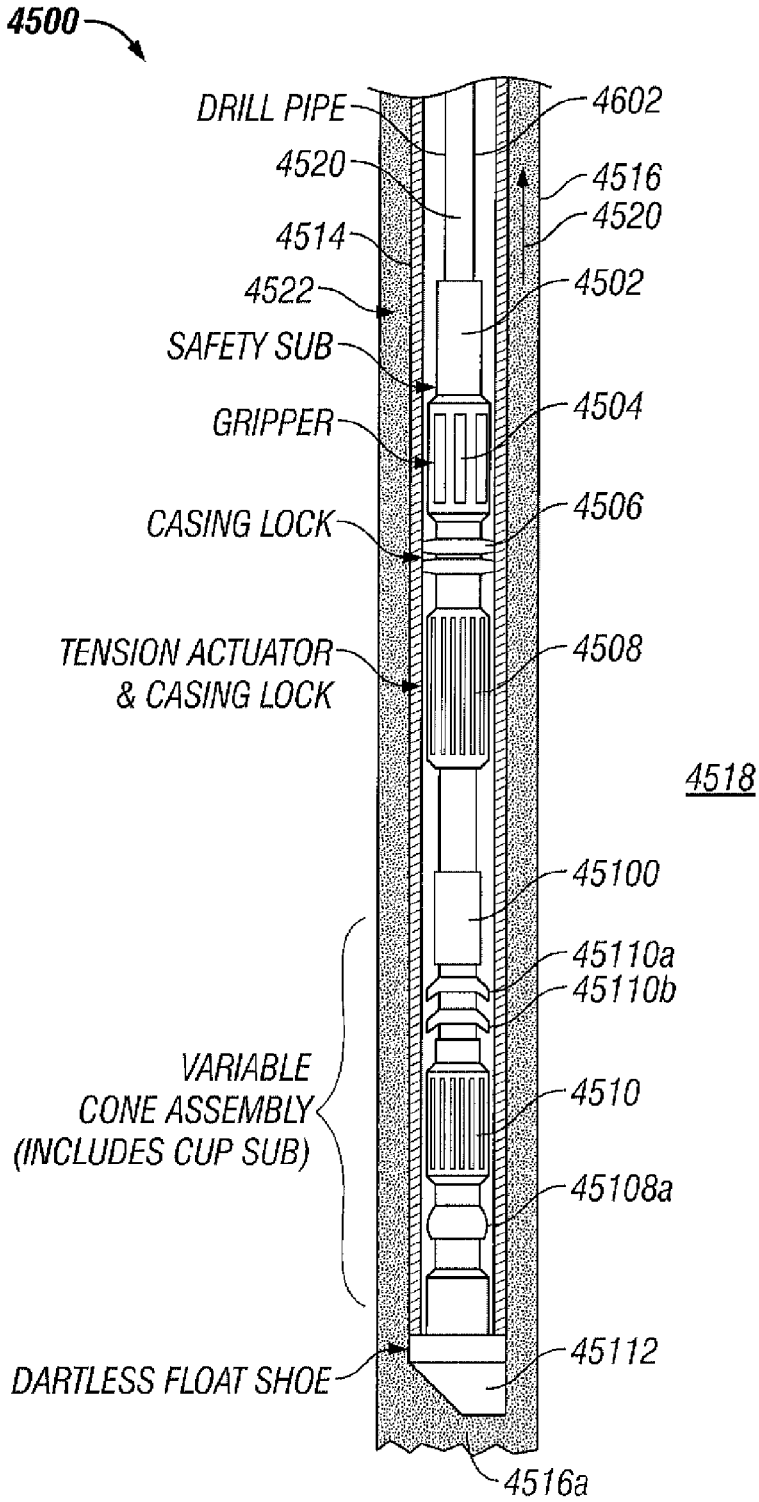

In an exemplary embodiment, during further operation of the system 4500, as illustrated in FIG. 49, a hardenable fluidic sealing material 4520 may then be injected into and through the system. In an exemplary embodiment, the hardenable fluidic sealing material 4520 may then be exhausted from the system through the float shoe 4512 to thereby fill an annulus 4522, defined between the wellbore casing 4514 and the wellbore 4516 with an annular column of the hardenable fluidic sealing material. In an exemplary embodiment, the hardenable fluidic sealing material is cement.

Figure 50:
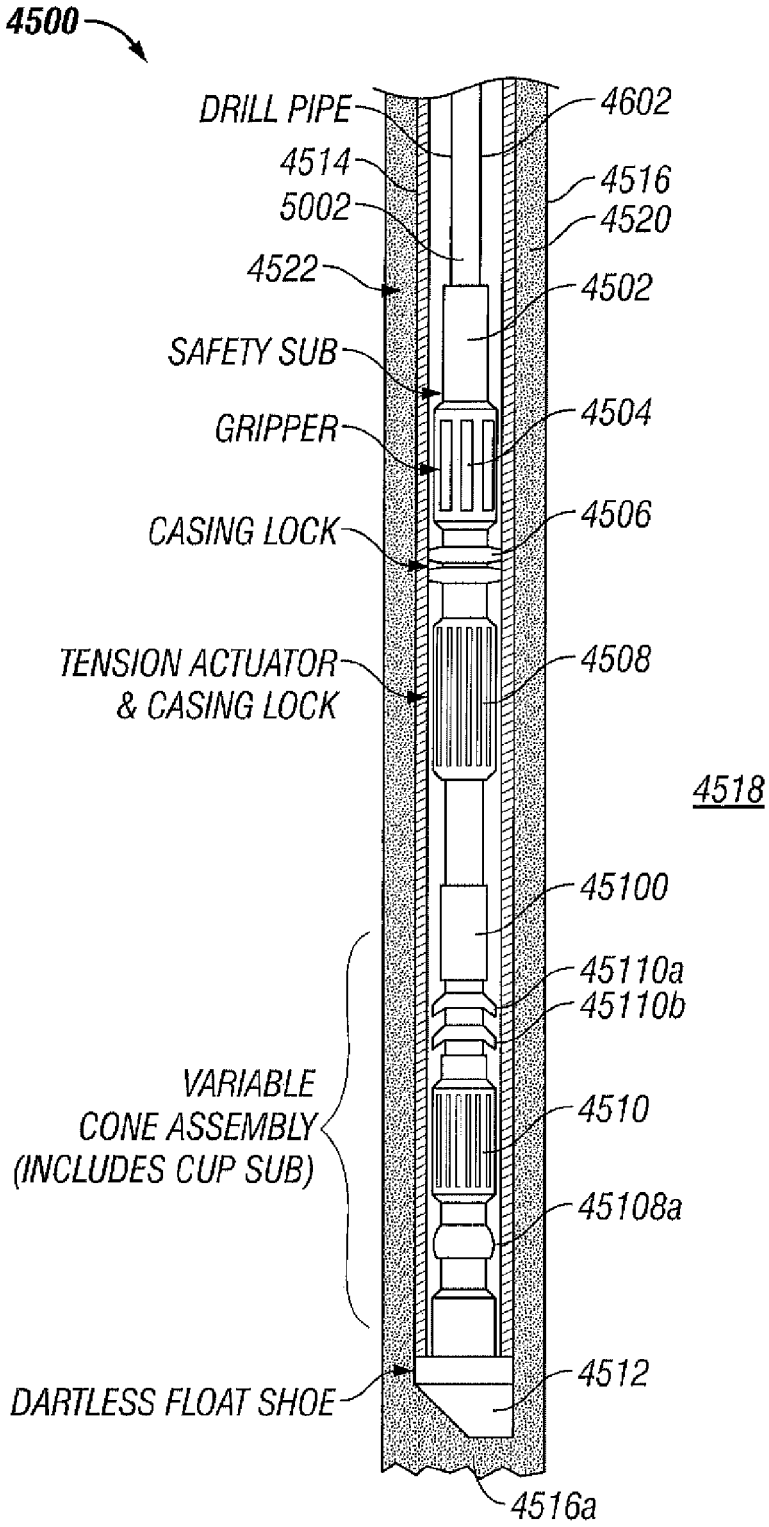

In an exemplary embodiment, during further operation of the system 4500, as illustrated in FIG. 50, a ball, dart, or other equivalent device may then introduced into the system 4500 by injecting a fluidic material 5002 into the system. As a result, in an exemplary embodiment, the ball, dart, or equivalent device may be positioned within a restriction provided within the float shoe 4512 to thereby prevent further flow of fluidic materials out of the system through the float shoe.

In an exemplary embodiment, during further operation of the system 4500, as illustrated in FIGS. 51, 51*a*, 51*b*, 51*c*, and 51*d*, continued injection of the fluidic material 5002 into the system 4500 may then pressurize the interior passages of the system sufficient to operate the actuator 45104 to displace the tubular support member 45106 in a direction opposite the direction 45108*ae*. As a result, in an exemplary embodiment, the expansion cone elements 45018*a* pivot in an outer radial direction relative to the tubular support member 45102 and are driven up the circumferentially spaced apart ramp members 45106*b* of the tubular support member 45106. As a result, in an exemplary embodiment, the retaining ring 45108*ba* and the circumferentially spaced apart coupling elements 45108*bb* are displaced in the direction 45018*ae* and the ends of the coupling elements that are coupled to the ends of the corresponding expansion cone elements 45018*a* are also displaced in a radial outer direction. As a result, in an exemplary embodiment, the circumferentially spaced apart coupling elements 45108*bb* are elastically deformed in an outer radial direction and the resulting spring force maintains the corresponding expansion cone elements 45018*a* in intimate contact with the corresponding circumferentially spaced apart ramp members 45106*b* of the tubular support member 45106.

In an exemplary embodiment, during further operation of the system 4500, as illustrated in FIG. 52, continued injection of fluidic materials into the system 4500 may pressurize an interior region 4514*a* of the wellbore casing 4514. As a result, the 4510 may be decoupled from the 4512, and the remainder of the 4500 may be displaced upwardly in a direction 5202 relative to the 4512. As a result, the wellbore casing 4514 may be radially expanded and plastically deformed. In an exemplary embodiment, during the further operation of the system 4500, a pressure differential is created within the wellbore casing 4514 across one or both of the cup seals 45110*a* and 45110*b*. As a result, the system 4500 is pulled upwardly through the wellbore casing 4514. In an exemplary embodiment, the system 4500 may also, or in the alternative, be pulled upwardly through the wellbore casing by pulling on the drill pipe 4602 and/or by operating the tension actuator assembly 4508.

In an exemplary embodiment, as illustrated in FIG. 53, the actuator 45104 includes an hydraulic actuator 5302 that is operably coupled to a variable orifice 5304 and a sensor 5306. In an exemplary embodiment, the variable orifice 5304 and sensor 5306 are also operably coupled to a controller 5308.

In an exemplary embodiment, the hydraulic actuator 5302, variable orifice 5304, and sensor 5306 may be of conventional design. In an exemplary embodiment, the controller 5308 may be a conventional programmable controller.

In an exemplary embodiment, during operation of the actuator 45104, the size of the variable orifice 5304 is controllably varied by the controller 5308 to thereby control the movement and rate of movement of the hydraulic actuator 5302. In an exemplary embodiment, the size of the adjustable expansion device 4510 is controlled by the controller 5308 as a function of the feeback signals provided by the sensor 5306. In an exemplary embodiment, the sensor 5306 may, for example, include a position sensor for sensing a degree of displacement of the hydraulic actuator, a pressure sensor for sensing an operating pressure of the fluidic material 5002, and/or a radial expansion sensor for sensing a degree of radial expansion of the wellbore casing 4514. In this manner, the degree of displacement of the expansion cone elements 45018*a* relative to the tubular support member 45106 may be controlled as a function of one or more operational parameters.

An apparatus for radially expanding and plastically deforming an expandable tubular member has been described that includes a support member, a cutting device for cutting the tubular member coupled to the support member, and an expansion device for radially expanding and plastically deforming the tubular member coupled to the support member. In an exemplary embodiment, the apparatus further includes a gripping device for gripping the tubular member coupled to the support member. In an exemplary embodiment, the gripping device comprises a plurality of movable gripping elements. In an exemplary embodiment, the gripping elements are moveable in a radial direction relative to the support member. In an exemplary embodiment, the gripping elements are moveable in an axial direction relative to the support member. In an exemplary embodiment, the gripping elements are moveable in a radial and an axial direction relative to the support member. In an exemplary embodiment, the gripping elements are moveable from a first position to a second position; wherein in the first position, the gripping elements do not engage the tubular member; wherein in the second position, the gripping elements do engage the tubular member, and wherein, during the movement from the first position to the second position, the gripping elements move in a radial and an axial direction relative to the support member. In an exemplary embodiment, the gripping elements are moveable from a first position to a second position; wherein in the first position, the gripping elements do not engage the tubular member; wherein in the second position, the gripping elements do engage the tubular member; and wherein, during the movement from the first position to the second position, the gripping elements move in a radial direction relative to the support member. In an exemplary embodiment, the gripping elements are moveable from a first position to a second position; wherein in the first position, the gripping elements do not engage the tubular member; wherein in the second position, the gripping elements do engage the tubular member; and wherein, during the movement from the first position to the second position, the gripping elements move in an axial direction relative to the support member. In an exemplary embodiment, if the tubular member is displaced in a first axial direction, the gripping device grips the tubular member; and, if the tubular member is displaced in a second axial direction, the gripping device does not grip the tubular member. In an exemplary embodiment, the gripping elements are moveable from a first position to a second position; wherein in the first position, the gripping elements do not engage the tubular member; wherein in the second position, the gripping elements do engage the tubular member; and wherein, the gripping elements are biased to remain in the first position. In an exemplary embodiment, the gripping device further includes an actuator for moving the gripping elements from a first position to a second position; wherein in the first position, the gripping elements do not engage the tubular member; wherein in the second position, the gripping elements do engage the tubular member; and wherein the actuator is a fluid powered actuator. In an exemplary embodiment, the apparatus further includes a sealing device for sealing an interface with the tubular member coupled to the support member. In an exemplary embodiment, the sealing device seals an annulus defines between the support member and the tubular member. In an exemplary embodiment, the apparatus further includes a locking device for locking the position of the tubular member relative to the support member. In an exemplary embodiment, the apparatus further includes a packer assembly coupled to the support member. In an exemplary embodiment, the packer assembly includes a packer; and a packer control device for controlling the operation of the packer coupled to the support member. In an exemplary embodiment, the packer includes: a support member defining a passage; a shoe comprising a float valve coupled to an end of the support member; one or more compressible packer elements movably coupled to the support member; and a sliding sleeve valve movably positioned within the passage of the support member. In an exemplary embodiment, the packer control device includes a support member; one or more drag blocks releasably coupled to the support member; and a stinger coupled to the support member for engaging the packer. In an exemplary embodiment, the packer includes a support member defining a passage; a shoe comprising a float valve coupled to an end of the support member; one or more compressible packer elements movably coupled to the support member; and a sliding sleeve valve positioned within the passage of the support member; and wherein the packer control device includes: a support member; one or more drag blocks releasably coupled to the support member; and a stinger coupled to the support member for engaging the sliding sleeve valve. In an exemplary embodiment, the apparatus further includes an actuator for displacing the expansion device relative to the support member. In an exemplary embodiment, the actuator includes a first actuator for pulling the expansion device; and a second actuator for pushing the expansion device. In an exemplary embodiment, the actuator includes means for transferring torsional loads between the support member and the expansion device. In an exemplary embodiment, the first and second actuators include means for transferring torsional loads between the support member and the expansion device. In an exemplary embodiment, the actuator includes a plurality of pistons positioned within corresponding piston chambers. In an exemplary embodiment, the cutting device includes a support member; and a plurality of movable cutting elements coupled to the support member. In an exemplary embodiment, the apparatus further includes an actuator coupled to the support member for moving the cutting elements between a first position and a second position; wherein in the first position, the cutting elements do not engage the tubular member; and wherein in the second position, the cutting elements engage the tubular member. In an exemplary embodiment, the apparatus further includes a sensor coupled to the support member for sensing the internal diameter of the tubular member. In an exemplary embodiment, the sensor prevents the cutting elements from being moved to the second position if the internal diameter of the tubular member is less than a predetermined value. In an exemplary embodiment, the cutting elements includes a first set of cutting elements; and a second set of cutting elements; wherein the first set of cutting elements are interleaved with the second set of cutting elements. In an exemplary embodiment, in the first position, the first set of cutting elements are not axially aligned with the second set of cutting elements. In an exemplary embodiment, in the second position, the first set of cutting elements are axially aligned with the second set of cutting elements. In an exemplary embodiment, the expansion device includes a support member; and a plurality of movable expansion elements coupled to the support member. In an exemplary embodiment, apparatus further includes an actuator coupled to the support member for moving the expansion elements between a first position and a second position; wherein in the first position, the expansion elements do not engage the tubular member; and wherein in the second position, the expansion elements engage the tubular member. In an exemplary embodiment, the apparatus further includes a sensor coupled to the support member for sensing the internal diameter of the tubular member. In an exemplary embodiment, the sensor prevents the expansion elements from being moved to the second position if the internal diameter of the tubular member is less than a predetermined value. In an exemplary embodiment, the expansion elements include a first set of expansion elements; and a second set of expansion elements; wherein the first set of expansion elements are interleaved with the second set of expansion elements. In an exemplary embodiment, in the first position, the first set of expansion elements are not axially aligned with the second set of expansion elements. In an exemplary embodiment, in the second position, the first set of expansion elements are axially aligned with the second set of expansion elements. In an exemplary embodiment, the expansion device includes an adjustable expansion device. In an exemplary embodiment, the expansion device includes a plurality of expansion devices. In an exemplary embodiment, at least one of the expansion devices includes an adjustable expansion device. In an exemplary embodiment, the adjustable expansion device includes a support member; and a plurality of movable expansion elements coupled to the support member. In an exemplary embodiment, the apparatus further includes an actuator coupled to the support member for moving the expansion elements between a first position and a second position; wherein in the first position, the expansion elements do not engage the tubular member; and wherein in the second position, the expansion elements engage the tubular member. In an exemplary embodiment, the apparatus further includes a sensor coupled to the support member for sensing the internal diameter of the tubular member. In an exemplary embodiment, the sensor prevents the expansion elements from being moved to the second position if the internal diameter of the tubular member is less than a predetermined value. In an exemplary embodiment, the expansion elements include a first set of expansion elements; and a second set of expansion elements; wherein the first set of expansion elements are interleaved with the second set of expansion elements. In an exemplary embodiment, in the first position, the first set of expansion elements are not axially aligned with the second set of expansion elements. In an exemplary embodiment, in the second position, the first set of expansion elements are axially aligned with the second set of expansion elements.

An apparatus for radially expanding and plastically deforming an expandable tubular member has been described that includes a support member, an expansion device for radially expanding and plastically deforming the tubular member coupled to the support member, and an actuator coupled to the support member for displacing the expansion device relative to the support member. In an exemplary embodiment, the apparatus further includes a cutting device coupled to the support member for cutting the tubular member. In an exemplary embodiment, the cutting device includes a support member; and a plurality of movable cutting elements coupled to the support member. In an exemplary embodiment, the apparatus further includes an actuator coupled to the support member for moving the cutting elements between a first position and a second position; wherein in the first position, the cutting elements do not engage the tubular member; and wherein in the second position, the cutting elements engage the tubular member. In an exemplary embodiment, the apparatus further includes a sensor coupled to the support member for sensing the internal diameter of the tubular member. In an exemplary embodiment, the sensor prevents the cutting elements from being moved to the second position if the internal diameter of the tubular member is less than a predetermined value. In an exemplary embodiment, the cutting elements include a first set of cutting elements; and a second set of cutting elements; wherein the first set of cutting elements are interleaved with the second set of cutting elements. In an exemplary embodiment, in the first position, the first set of cutting elements are not axially aligned with the second set of cutting elements. In an exemplary embodiment, in the second position, the first set of cutting elements are axially aligned with the second set of cutting elements. In an exemplary embodiment, the apparatus further includes a gripping device for gripping the tubular member coupled to the support member. In an exemplary embodiment, the gripping device includes a plurality of movable gripping elements. In an exemplary embodiment, the gripping elements are moveable in a radial direction relative to the support member. In an exemplary embodiment, the gripping elements are moveable in an axial direction relative to the support member. In an exemplary embodiment, the gripping elements are moveable in a radial and an axial direction relative to the support member. In an exemplary embodiment, the gripping elements are moveable from a first position to a second position; wherein in the first position, the gripping elements do not engage the tubular member; wherein in the second position, the gripping elements do engage the tubular member; and wherein, during the movement from the first position to the second position, the gripping elements move in a radial and an axial direction relative to the support member. In an exemplary embodiment, the gripping elements are moveable from a first position to a second position; wherein in the first position, the gripping elements do not engage the tubular member; wherein in the second position, the gripping elements do engage the tubular member; and wherein, during the movement from the first position to the second position, the gripping elements move in a radial direction relative to the support member. In an exemplary embodiment, the gripping elements are moveable from a first position to a second position; wherein in the first position, the gripping elements do not engage the tubular member; wherein in the second position, the gripping elements do engage the tubular member; and wherein, during the movement from the first position to the second position, the gripping elements move in an axial direction relative to the support member. In an exemplary embodiment, if the tubular member is displaced in a first axial direction, the gripping device grips the tubular member; and wherein, if the tubular member is displaced in a second axial direction, the gripping device does not grip the tubular member. In an exemplary embodiment, the gripping elements are moveable from a first position to a second position; wherein in the first position, the gripping elements do not engage the tubular member; wherein in the second position, the gripping elements do engage the tubular member; and wherein, the gripping elements are biased to remain in the first position. In an exemplary embodiment, the gripping device further includes an actuator for moving the gripping elements from a first position to a second position; wherein in the first position, the gripping elements do not engage the tubular member; wherein in the second position, the gripping elements do engage the tubular member; and wherein the actuator is a fluid powered actuator. In an exemplary embodiment, the apparatus further includes a sealing device for sealing an interface with the tubular member coupled to the support member. In an exemplary embodiment, the sealing device seals an annulus defines between the support member and the tubular member. In an exemplary embodiment, the apparatus further includes a locking device for locking the position of the tubular member relative to the support member. In an exemplary embodiment, the apparatus further includes a packer assembly coupled to the support member. In an exemplary embodiment, the packer assembly includes a packer; and a packer control device for controlling the operation of the packer coupled to the support member. In an exemplary embodiment, the packer includes a support member defining a passage; a shoe comprising a float valve coupled to an end of the support member; one or more compressible packer elements movably coupled to the support member; and a sliding sleeve valve movably positioned within the passage of the support member. In an exemplary embodiment, the packer control device includes a support member; one or more drag blocks releasably coupled to the support member; and a stinger coupled to the support member for engaging the packer. In an exemplary embodiment, the packer includes a support member defining a passage; a shoe comprising a float valve coupled to an end of the support member; one or more compressible packer elements movably coupled to the support member; and a sliding sleeve valve positioned within the passage of the support member; and wherein the packer control device comprises: a support member; one or more drag blocks releasably coupled to the support member; and a stinger coupled to the support member for engaging the sliding sleeve valve. In an exemplary embodiment, the expansion device includes a support member; and a plurality of movable expansion elements coupled to the support member. In an exemplary embodiment, the apparatus further includes an actuator coupled to the support member for moving the expansion elements between a first position and a second position; wherein in the first position, the expansion elements do not engage the tubular member; and wherein in the second position, the expansion elements engage the tubular member. In an exemplary embodiment, the apparatus further includes a sensor coupled to the support member for sensing the internal diameter of the tubular member. In an exemplary embodiment, the sensor prevents the expansion elements from being moved to the second position if the internal diameter of the tubular member is less than a predetermined value. In an exemplary embodiment, the expansion elements include a first set of expansion elements; and a second set of expansion elements; wherein the first set of expansion elements are interleaved with the second set of expansion elements. In an exemplary embodiment, the in the first position, the first set of expansion elements are not axially aligned with the second set of expansion elements. In an exemplary embodiment, in the second position, the first set of expansion elements are axially aligned with the second set of expansion elements. In an exemplary embodiment, the expansion device includes an adjustable expansion device. In an exemplary embodiment, the expansion device includes a plurality of expansion devices. In an exemplary embodiment, at least one of the expansion devices includes an adjustable expansion device. In an exemplary embodiment, the adjustable expansion device includes a support member; and a plurality of movable expansion elements coupled to the support member. In an exemplary embodiment, the apparatus further includes an actuator coupled to the support member for moving the expansion elements between a first position and a second position; wherein in the first position, the expansion elements do not engage the tubular member; and wherein in the second position, the expansion elements engage the tubular member. In an exemplary embodiment, the apparatus further includes a sensor coupled to the support member for sensing the internal diameter of the tubular member. In an exemplary embodiment, the sensor prevents the expansion elements from being moved to the second position if the internal diameter of the tubular member is less than a predetermined value. In an exemplary embodiment, the expansion elements include a first set of expansion elements; and a second set of expansion elements; wherein the first set of expansion elements are interleaved with the second set of expansion elements. In an exemplary embodiment, in the first position, the first set of expansion elements are not axially aligned with the second set of expansion elements. In an exemplary embodiment, in the second position, the first set of expansion elements are axially aligned with the second set of expansion elements.

An apparatus for radially expanding and plastically deforming an expandable tubular member has been described that includes a support member; an expansion device for radially expanding and plastically deforming the tubular member coupled to the support member; and a sealing assembly for sealing an annulus defined between the support member and the tubular member. In an exemplary embodiment, the apparatus further includes a gripping device for gripping the tubular member coupled to the support member. In an exemplary embodiment, the gripping device includes a plurality of movable gripping elements. In an exemplary embodiment, the gripping elements are moveable in a radial direction relative to the support member. In an exemplary embodiment, the gripping elements are moveable in an axial direction relative to the support member. In an exemplary embodiment, the gripping elements are moveable in a radial and an axial direction relative to the support member. In an exemplary embodiment, the gripping elements are moveable from a first position to a second position; wherein in the first position, the gripping elements do not engage the tubular member; wherein in the second position, the gripping elements do engage the tubular member; and wherein, during the movement from the first position to the second position, the gripping elements move in a radial and an axial direction relative to the support member. In an exemplary embodiment, the gripping elements are moveable from a first position to a second position; wherein in the first position, the gripping elements do not engage the tubular member; wherein in the second position, the gripping elements do engage the tubular member; and wherein, during the movement from the first position to the second position, the gripping elements move in a radial direction relative to the support member. In an exemplary embodiment, the gripping elements are moveable from a first position to a second position; wherein in the first position, the gripping elements do not engage the tubular member; wherein in the second position, the gripping elements do engage the tubular member; and wherein, during the movement from the first position to the second position, the gripping elements move in an axial direction relative to the support member. In an exemplary embodiment, the if the tubular member is displaced in a first axial direction, the gripping device grips the tubular member; and wherein, if the tubular member is displaced in a second axial direction, the gripping device does not grip the tubular member. In an exemplary embodiment, the gripping elements are moveable from a first position to a second position; wherein in the first position, the gripping elements do not engage the tubular member; wherein in the second position, the gripping elements do engage the tubular member; and wherein, the gripping elements are biased to remain in the first position. In an exemplary embodiment, the gripping device further includes an actuator for moving the gripping elements from a first position to a second position; wherein in the first position, the gripping elements do not engage the tubular member; wherein in the second position, the gripping elements do engage the tubular member; and wherein the actuator is a fluid powered actuator. In an exemplary embodiment, the apparatus further includes a locking device for locking the position of the tubular member relative to the support member. In an exemplary embodiment, the apparatus further includes a packer assembly coupled to the support member. In an exemplary embodiment, the packer assembly includes a packer; and a packer control device for controlling the operation of the packer coupled to the support member. In an exemplary embodiment, the packer includes a support member defining a passage; a shoe comprising a float valve coupled to an end of the support member; one or more compressible packer elements movably coupled to the support member; and a sliding sleeve valve movably positioned within the passage of the support member. In an exemplary embodiment, the packer control device includes a support member; one or more drag blocks releasably coupled to the support member; and a stinger coupled to the support member for engaging the packer. In an exemplary embodiment, the packer includes a support member defining a passage; a shoe comprising a float valve coupled to an end of the support member; one or more compressible packer elements movably coupled to the support member; and a sliding sleeve valve positioned within the passage of the support member; and wherein the packer control device includes a support member; one or more drag blocks releasably coupled to the support member; and a stinger coupled to the support member for engaging the sliding sleeve valve. In an exemplary embodiment, the apparatus further includes an actuator for displacing the expansion device relative to the support member. In an exemplary embodiment, the actuator includes a first actuator for pulling the expansion device; and a second actuator for pushing the expansion device. In an exemplary embodiment, the actuator includes means for transferring torsional loads between the support member and the expansion device. In an exemplary embodiment, the first and second actuators comprise means for transferring torsional loads between the support member and the expansion device. In an exemplary embodiment, the actuator includes a plurality of pistons positioned within corresponding piston chambers. In an exemplary embodiment, the cutting device includes a support member; and a plurality of movable cutting elements coupled to the support member. In an exemplary embodiment, the apparatus further includes an actuator coupled to the support member for moving the cutting elements between a first position and a second position; wherein in the first position, the cutting elements do not engage the tubular member; and wherein in the second position, the cutting elements engage the tubular member. In an exemplary embodiment, the apparatus further includes a sensor coupled to the support member for sensing the internal diameter of the tubular member. In an exemplary embodiment, the sensor prevents the cutting elements from being moved to the second position if the internal diameter of the tubular member is less than a predetermined value. In an exemplary embodiment, the cutting elements include a first set of cutting elements; and a second set of cutting elements; wherein the first set of cutting elements are interleaved with the second set of cutting elements. In an exemplary embodiment, in the first position, the first set of cutting elements are not axially aligned with the second set of cutting elements. In an exemplary embodiment, in the second position, the first set of cutting elements are axially aligned with the second set of cutting elements. In an exemplary embodiment, the expansion device includes a support member; and a plurality of movable expansion elements coupled to the support member. In an exemplary embodiment, the apparatus further includes an actuator coupled to the support member for moving the expansion elements between a first position and a second position; wherein in the first position, the expansion elements do not engage the tubular member; and wherein in the second position, the expansion elements engage the tubular member. In an exemplary embodiment, the apparatus further includes a sensor coupled to the support member for sensing the internal diameter of the tubular member. In an exemplary embodiment, the sensor prevents the expansion elements from being moved to the second position if the internal diameter of the tubular member is less than a predetermined value. In an exemplary embodiment, the expansion elements includes a first set of expansion elements; and a second set of expansion elements; wherein the first set of expansion elements are interleaved with the second set of expansion elements. In an exemplary embodiment, in the first position, the first set of expansion elements are not axially aligned with the second set of expansion elements. In an exemplary embodiment, in the second position, the first set of expansion elements are axially aligned with the second set of expansion elements. In an exemplary embodiment, the expansion device includes an adjustable expansion device. In an exemplary embodiment, the expansion device includes a plurality of expansion devices. In an exemplary embodiment, at least one of the expansion devices includes an adjustable expansion device. In an exemplary embodiment, the adjustable expansion device includes a support member; and a plurality of movable expansion elements coupled to the support member. In an exemplary embodiment, the apparatus further includes an actuator coupled to the support member for moving the expansion elements between a first position and a second position; wherein in the first position, the expansion elements do not engage the tubular member; and wherein in the second position, the expansion elements engage the tubular member. In an exemplary embodiment, the apparatus further includes a sensor coupled to the support member for sensing the internal diameter of the tubular member. In an exemplary embodiment, the sensor prevents the expansion elements from being moved to the second position if the internal diameter of the tubular member is less than a predetermined value. In an exemplary embodiment, the expansion elements include a first set of expansion elements; and a second set of expansion elements; wherein the first set of expansion elements are interleaved with the second set of expansion elements. In an exemplary embodiment, in the first position, the first set of expansion elements are not axially aligned with the second set of expansion elements. In an exemplary embodiment, in the second position, the first set of expansion elements are axially aligned with the second set of expansion elements.

An apparatus for radially expanding and plastically deforming an expandable tubular member has been described that includes a support member; a first expansion device for radially expanding and plastically deforming the tubular member coupled to the support member; and a second expansion device for radially expanding and plastically deforming the tubular member coupled to the support member. In an exemplary embodiment, the apparatus further includes a gripping device for gripping the tubular member coupled to the support member. In an exemplary embodiment, the gripping device includes a plurality of movable gripping elements. In an exemplary embodiment, the gripping elements are moveable in a radial direction relative to the support member. In an exemplary embodiment, the gripping elements are moveable in an axial direction relative to the support member. In an exemplary embodiment, the gripping elements are moveable in a radial and an axial direction relative to the support member. In an exemplary embodiment, the gripping elements are moveable from a first position to a second position; wherein in the first position, the gripping elements do not engage the tubular member; wherein in the second position, the gripping elements do engage the tubular member; and wherein, during the movement from the first position to the second position, the gripping elements move in a radial and an axial direction relative to the support member. In an exemplary embodiment, the gripping elements are moveable from a first position to a second position; wherein in the first position, the gripping elements do not engage the tubular member; wherein in the second position, the gripping elements do engage the tubular member; and wherein, during the movement from the first position to the second position, the gripping elements move in a radial direction relative to the support member. In an exemplary embodiment, the gripping elements are moveable from a first position to a second position; wherein in the first position, the gripping elements do not engage the tubular member; wherein in the second position, the gripping elements do engage the tubular member; and wherein, during the movement from the first position to the second position, the gripping elements move in an axial direction relative to the support member. In an exemplary embodiment, if the tubular member is displaced in a first axial direction, the gripping device grips the tubular member; and wherein, if the tubular member is displaced in a second axial direction, the gripping device does not grip the tubular member. In an exemplary embodiment, the gripping elements are moveable from a first position to a second position; wherein in the first position, the gripping elements do not engage the tubular member; wherein in the second position, the gripping elements do engage the tubular member; and wherein, the gripping elements are biased to remain in the first position. In an exemplary embodiment, the gripping device further includes an actuator for moving the gripping elements from a first position to a second position; wherein in the first position, the gripping elements do not engage the tubular member; wherein in the second position, the gripping elements do engage the tubular member; and wherein the actuator is a fluid powered actuator. In an exemplary embodiment, the apparatus further includes a sealing device for sealing an interface with the tubular member coupled to the support member. In an exemplary embodiment, the sealing device seals an annulus defines between the support member and the tubular member. In an exemplary embodiment, the apparatus further includes a locking device for locking the position of the tubular member relative to the support member. In an exemplary embodiment, the apparatus further includes a packer assembly coupled to the support member. In an exemplary embodiment, the packer assembly includes a packer; and a packer control device for controlling the operation of the packer coupled to the support member. In an exemplary embodiment, the packer includes a support member defining a passage; a shoe comprising a float valve coupled to an end of the support member; one or more compressible packer elements movably coupled to the support member; and a sliding sleeve valve movably positioned within the passage of the support member. In an exemplary embodiment, the packer control device includes a support member; one or more drag blocks releasably coupled to the support member; and a stinger coupled to the support member for engaging the packer. In an exemplary embodiment, the packer includes a support member defining a passage; a shoe comprising a float valve coupled to an end of the support member; one or more compressible packer elements movably coupled to the support member; and a sliding sleeve valve positioned within the passage of the support member; and wherein the packer control device comprises: a support member; one or more drag blocks releasably coupled to the support member; and a stinger coupled to the support member for engaging the sliding sleeve valve. In an exemplary embodiment, the apparatus further includes an actuator for displacing the expansion device relative to the support member. In an exemplary embodiment, the actuator includes a first actuator for pulling the expansion device; and a second actuator for pushing the expansion device. In an exemplary embodiment, the actuator includes means for transferring torsional loads between the support member and the expansion device. In an exemplary embodiment, the first and second actuators include means for transferring torsional loads between the support member and the expansion device. In an exemplary embodiment, the actuator includes a plurality of pistons positioned within corresponding piston chambers. In an exemplary embodiment, the apparatus further includes a cutting device for cutting the tubular member coupled to the support member. In an exemplary embodiment, the cutting device includes a support member; and a plurality of movable cutting elements coupled to the support member. In an exemplary embodiment, the apparatus further includes an actuator coupled to the support member for moving the cutting elements between a first position and a second position; wherein in the first position, the cutting elements do not engage the tubular member; and wherein in the second position, the cutting elements engage the tubular member. In an exemplary embodiment, the apparatus further includes a sensor coupled to the support member for sensing the internal diameter of the tubular member. In an exemplary embodiment, the sensor prevents the cutting elements from being moved to the second position if the internal diameter of the tubular member is less than a predetermined value. In an exemplary embodiment, the cutting elements include a first set of cutting elements; and a second set of cutting elements; wherein the first set of cutting elements are interleaved with the second set of cutting elements. In an exemplary embodiment, in the first position, the first set of cutting elements are not axially aligned with the second set of cutting elements. In an exemplary embodiment, in the second position, the first set of cutting elements are axially aligned with the second set of cutting elements. In an exemplary embodiment, at least one of the first second expansion devices include a support member; and a plurality of movable expansion elements coupled to the support member. In an exemplary embodiment, the apparatus further includes an actuator coupled to the support member for moving the expansion elements between a first position and a second position; wherein in the first position, the expansion elements do not engage the tubular member; and wherein in the second position, the expansion elements engage the tubular member. In an exemplary embodiment, the apparatus further includes a sensor coupled to the support member for sensing the internal diameter of the tubular member. In an exemplary embodiment, the sensor prevents the expansion elements from being moved to the second position if the internal diameter of the tubular member is less than a predetermined value. In an exemplary embodiment, the expansion elements include a first set of expansion elements; and a second set of expansion elements; wherein the first set of expansion elements are interleaved with the second set of expansion elements. In an exemplary embodiment, in the first position, the first set of expansion elements are not axially aligned with the second set of expansion elements. In an exemplary embodiment, in the second position, the first set of expansion elements are axially aligned with the second set of expansion elements. In an exemplary embodiment, at least one of the first and second expansion devices comprise a plurality of expansion devices. In an exemplary embodiment, at least one of the first and second expansion device comprise an adjustable expansion device. In an exemplary embodiment, the adjustable expansion device includes a support member; and a plurality of movable expansion elements coupled to the support member. In an exemplary embodiment, the apparatus further includes an actuator coupled to the support member for moving the expansion elements between a first position and a second position; wherein in the first position, the expansion elements do not engage the tubular member; and wherein in the second position, the expansion elements engage the tubular member. In an exemplary embodiment, the apparatus further includes a sensor coupled to the support member for sensing the internal diameter of the tubular member. In an exemplary embodiment, the sensor prevents the expansion elements from being moved to the second position if the internal diameter of the tubular member is less than a predetermined value. In an exemplary embodiment, the expansion elements include a first set of expansion elements; and a second set of expansion elements; wherein the first set of expansion elements are interleaved with the second set of expansion elements. In an exemplary embodiment, in the first position, the first set of expansion elements are not axially aligned with the second set of expansion elements. In an exemplary embodiment, in the second position, the first set of expansion elements are axially aligned with the second set of expansion elements.

An apparatus for radially expanding and plastically deforming an expandable tubular member has been described that includes a support member; an expansion device for radially expanding and plastically deforming the tubular member coupled to the support member; and a packer coupled to the support member. In an exemplary embodiment, the apparatus further includes a gripping device for gripping the tubular member coupled to the support member. In an exemplary embodiment, the gripping device comprises a plurality of movable gripping elements. In an exemplary embodiment, the gripping elements are moveable in a radial direction relative to the support member. In an exemplary embodiment, the gripping elements are moveable in an axial direction relative to the support member. In an exemplary embodiment, the gripping elements are moveable in a radial and an axial direction relative to the support member. In an exemplary embodiment, the gripping elements are moveable from a first position to a second position; wherein in the first position, the gripping elements do not engage the tubular member; wherein in the second position, the gripping elements do engage the tubular member; and wherein, during the movement from the first position to the second position, the gripping elements move in a radial and an axial direction relative to the support member. In an exemplary embodiment, the gripping elements are moveable from a first position to a second position; wherein in the first position, the gripping elements do not engage the tubular member; wherein in the second position, the gripping elements do engage the tubular member; and wherein, during the movement from the first position to the second position, the gripping elements move in a radial direction relative to the support member. In an exemplary embodiment, the gripping elements are moveable from a first position to a second position; wherein in the first position, the gripping elements do not engage the tubular member; wherein in the second position, the gripping elements do engage the tubular member; and wherein, during the movement from the first position to the second position, the gripping elements move in an axial direction relative to the support member. In an exemplary embodiment, if the tubular member is displaced in a first axial direction, the gripping device grips the tubular member; and wherein, if the tubular member is displaced in a second axial direction, the gripping device does not grip the tubular member. In an exemplary embodiment, the gripping elements are moveable from a first position to a second position; wherein in the first position, the gripping elements do not engage the tubular member; wherein in the second position, the gripping elements do engage the tubular member; and wherein, the gripping elements are biased to remain in the first position. In an exemplary embodiment, the gripping device further includes an actuator for moving the gripping elements from a first position to a second position; wherein in the first position, the gripping elements do not engage the tubular member; wherein in the second position, the gripping elements do engage the tubular member; and wherein the actuator is a fluid powered actuator. In an exemplary embodiment, the apparatus further includes a sealing device for sealing an interface with the tubular member coupled to the support member. In an exemplary embodiment, the sealing device seals an annulus defines between the support member and the tubular member. In an exemplary embodiment, the apparatus further includes a locking device for locking the position of the tubular member relative to the support member. In an exemplary embodiment, the packer assembly includes a packer; and a packer control device for controlling the operation of the packer coupled to the support member. In an exemplary embodiment, the packer includes a support member defining a passage; a shoe comprising a float valve coupled to an end of the support member; one or more compressible packer elements movably coupled to the support member; and a sliding sleeve valve movably positioned within the passage of the support member. In an exemplary embodiment, the packer control device includes a support member; one or more drag blocks releasably coupled to the support member; and a stinger coupled to the support member for engaging the packer. In an exemplary embodiment, the packer includes a support member defining a passage; a shoe comprising a float valve coupled to an end of the support member; one or more compressible packer elements movably coupled to the support member; and a sliding sleeve valve positioned within the passage of the support member; and wherein the packer control device includes a support member; one or more drag blocks releasably coupled to the support member; and a stinger coupled to the support member for engaging the sliding sleeve valve. In an exemplary embodiment, the apparatus further includes an actuator for displacing the expansion device relative to the support member. In an exemplary embodiment, the actuator includes a first actuator for pulling the expansion device; and a second actuator for pushing the expansion device. In an exemplary embodiment, the actuator includes means for transferring torsional loads between the support member and the expansion device. In an exemplary embodiment, the first and second actuators include means for transferring torsional loads between the support member and the expansion device. In an exemplary embodiment, the actuator includes a plurality of pistons positioned within corresponding piston chambers. In an exemplary embodiment, the apparatus further includes a cutting device coupled to the support member for cutting the tubular member. In an exemplary embodiment, the cutting device includes a support member; and a plurality of movable cutting elements coupled to the support member. In an exemplary embodiment, the apparatus further includes an actuator coupled to the support member for moving the cutting elements between a first position and a second position; wherein in the first position, the cutting elements do not engage the tubular member; and wherein in the second position, the cutting elements engage the tubular member. In an exemplary embodiment, the apparatus further includes a sensor coupled to the support member for sensing the internal diameter of the tubular member. In an exemplary embodiment, the sensor prevents the cutting elements from being moved to the second position if the internal diameter of the tubular member is less than a predetermined value. In an exemplary embodiment, the cutting elements include a first set of cutting elements; and a second set of cutting elements; wherein the first set of cutting elements are interleaved with the second set of cutting elements. In an exemplary embodiment, in the first position, the first set of cutting elements are not axially aligned with the second set of cutting elements. In an exemplary embodiment, in the second position, the first set of cutting elements are axially aligned with the second set of cutting elements. In an exemplary embodiment, the expansion device includes a support member; and a plurality of movable expansion elements coupled to the support member. In an exemplary embodiment, the apparatus further includes an actuator coupled to the support member for moving the expansion elements between a first position and a second position; wherein in the first position, the expansion elements do not engage the tubular member; and wherein in the second position, the expansion elements engage the tubular member. In an exemplary embodiment, the apparatus further includes a sensor coupled to the support member for sensing the internal diameter of the tubular member. In an exemplary embodiment, the sensor prevents the expansion elements from being moved to the second position if the internal diameter of the tubular member is less than a predetermined value. In an exemplary embodiment, the expansion elements include a first set of expansion elements; and a second set of expansion elements; wherein the first set of expansion elements are interleaved with the second set of expansion elements. In an exemplary embodiment, in the first position, the first set of expansion elements are not axially aligned with the second set of expansion elements. In an exemplary embodiment, in the second position, the first set of expansion elements are axially aligned with the second set of expansion elements. In an exemplary embodiment, the expansion device includes an adjustable expansion device. In an exemplary embodiment, the expansion device includes a plurality of expansion devices. In an exemplary embodiment, at least one of the expansion devices comprises an adjustable expansion device. In an exemplary embodiment, the adjustable expansion device includes a support member; and a plurality of movable expansion elements coupled to the support member. In an exemplary embodiment, the apparatus further includes an actuator coupled to the support member for moving the expansion elements between a first position and a second position; wherein in the first position, the expansion elements do not engage the tubular member; and wherein in the second position, the expansion elements engage the tubular member. In an exemplary embodiment, the apparatus further includes a sensor coupled to the support member for sensing the internal diameter of the tubular member. In an exemplary embodiment, the sensor prevents the expansion elements from being moved to the second position if the internal diameter of the tubular member is less than a predetermined value. In an exemplary embodiment, the expansion elements include a first set of expansion elements; and a second set of expansion elements; wherein the first set of expansion elements are interleaved with the second set of expansion elements. In an exemplary embodiment, in the first position, the first set of expansion elements are not axially aligned with the second set of expansion elements. In an exemplary embodiment, in the second position, the first set of expansion elements are axially aligned with the second set of expansion elements.

An apparatus for radially expanding and plastically deforming an expandable tubular member has been described that includes a support member; a cutting device for cutting the tubular member coupled to the support member; a gripping device for gripping the tubular member coupled to the support member; a sealing device for sealing an interface with the tubular member coupled to the support member; a locking device for locking the position of the tubular member relative to the support member; a first adjustable expansion device for radially expanding and plastically deforming the tubular member coupled to the support member; a second adjustable expansion device for radially expanding and plastically deforming the tubular member coupled to the support member; a packer coupled to the support member; and an actuator for displacing one or more of the sealing assembly, first and second adjustable expansion devices, and packer relative to the support member. In an exemplary embodiment, the gripping device includes a plurality of movable gripping elements. In an exemplary embodiment, the gripping elements are moveable in a radial direction relative to the support member. In an exemplary embodiment, the gripping elements are moveable in an axial direction relative to the support member. In an exemplary embodiment, the gripping elements are moveable in a radial and an axial direction relative to the support member. In an exemplary embodiment, the gripping elements are moveable from a first position to a second position; wherein in the first position, the gripping elements do not engage the tubular member; wherein in the second position, the gripping elements do engage the tubular member; and wherein, during the movement from the first position to the second position, the gripping elements move in a radial and an axial direction relative to the support member. In an exemplary embodiment, the gripping elements are moveable from a first position to a second position; wherein in the first position, the gripping elements do not engage the tubular member; wherein in the second position, the gripping elements do engage the tubular member; and wherein, during the movement from the first position to the second position, the gripping elements move in a radial direction relative to the support member. In an exemplary embodiment, the gripping elements are moveable from a first position to a second position; wherein in the first position, the gripping elements do not engage the tubular member; wherein in the second position, the gripping elements do engage the tubular member; and wherein, during the movement from the first position to the second position, the gripping elements move in an axial direction relative to the support member. In an exemplary embodiment, if the tubular member is displaced in a first axial direction, the gripping device grips the tubular member; and wherein, if the tubular member is displaced in a second axial direction, the gripping device does not grip the tubular member. In an exemplary embodiment, the gripping elements are moveable from a first position to a second position; wherein in the first position, the gripping elements do not engage the tubular member; wherein in the second position, the gripping elements do engage the tubular member; and wherein, the gripping elements are biased to remain in the first position. In an exemplary embodiment, the gripping device further includes an actuator for moving the gripping elements from a first position to a second position; wherein in the first position, the gripping elements do not engage the tubular member; wherein in the second position, the gripping elements do engage the tubular member; and wherein the actuator is a fluid powered actuator. In an exemplary embodiment, the sealing device seals an annulus defines between the support member and the tubular member. In an exemplary embodiment, the packer assembly includes a packer; and a packer control device for controlling the operation of the packer coupled to the support member. In an exemplary embodiment, the packer includes a support member defining a passage; a shoe comprising a float valve coupled to an end of the support member; one or more compressible packer elements movably coupled to the support member; and a sliding sleeve valve movably positioned within the passage of the support member. In an exemplary embodiment, the packer control device includes a support member; one or more drag blocks releasably coupled to the support member; and a stinger coupled to the support member for engaging the packer. In an exemplary embodiment, the packer includes a support member defining a passage; a shoe comprising a float valve coupled to an end of the support member; one or more compressible packer elements movably coupled to the support member; and a sliding sleeve valve positioned within the passage of the support member; and wherein the packer control device includes a support member; one or more drag blocks releasably coupled to the support member; and a stinger coupled to the support member for engaging the sliding sleeve valve. In an exemplary embodiment, the actuator includes a first actuator for pulling the expansion device; and a second actuator for pushing the expansion device. In an exemplary embodiment, the actuator includes means for transferring torsional loads between the support member and the expansion device. In an exemplary embodiment, the first and second actuators include means for transferring torsional loads between the support member and the expansion device. In an exemplary embodiment, the actuator includes a plurality of pistons positioned within corresponding piston chambers. In an exemplary embodiment, the cutting device includes a support member; and a plurality of movable cutting elements coupled to the support member. In an exemplary embodiment, the apparatus further includes an actuator coupled to the support member for moving the cutting elements between a first position and a second position; wherein in the first position, the cutting elements do not engage the tubular member; and wherein in the second position, the cutting elements engage the tubular member. In an exemplary embodiment, the apparatus further includes a sensor coupled to the support member for sensing the internal diameter of the tubular member. In an exemplary embodiment, the sensor prevents the cutting elements from being moved to the second position if the internal diameter of the tubular member is less than a predetermined value. In an exemplary embodiment, the cutting elements include a first set of cutting elements; and a second set of cutting elements; wherein the first set of cutting elements are interleaved with the second set of cutting elements. In an exemplary embodiment, in the first position, the first set of cutting elements are not axially aligned with the second set of cutting elements. In an exemplary embodiment, in the second position, the first set of cutting elements are axially aligned with the second set of cutting elements. In an exemplary embodiment, at least one of the adjustable expansion devices include a support member; and a plurality of movable expansion elements coupled to the support member. In an exemplary embodiment, the apparatus further includes an actuator coupled to the support member for moving the expansion elements between a first position and a second position; wherein in the first position, the expansion elements do not engage the tubular member; and wherein in the second position, the expansion elements engage the tubular member. In an exemplary embodiment, the apparatus further includes a sensor coupled to the support member for sensing the internal diameter of the tubular member. In an exemplary embodiment, the sensor prevents the expansion elements from being moved to the second position if the internal diameter of the tubular member is less than a predetermined value. In an exemplary embodiment, the expansion elements include a first set of expansion elements; and a second set of expansion elements; wherein the first set of expansion elements are interleaved with the second set of expansion elements. In an exemplary embodiment, in the first position, the first set of expansion elements are not axially aligned with the second set of expansion elements. In an exemplary embodiment, in the second position, the first set of expansion elements are axially aligned with the second set of expansion elements. In an exemplary embodiment, at least one of the adjustable expansion devices comprise a plurality of expansion devices. In an exemplary embodiment, at least one of the adjustable expansion devices include a support member; and a plurality of movable expansion elements coupled to the support member. In an exemplary embodiment, the apparatus further includes an actuator coupled to the support member for moving the expansion elements between a first position and a second position; wherein in the first position, the expansion elements do not engage the tubular member; and wherein in the second position, the expansion elements engage the tubular member. In an exemplary embodiment, the apparatus further includes a sensor coupled to the support member for sensing the internal diameter of the tubular member. In an exemplary embodiment, the sensor prevents the expansion elements from being moved to the second position if the internal diameter of the tubular member is less than a predetermined value. In an exemplary embodiment, the expansion elements include a first set of expansion elements; and a second set of expansion elements; wherein the first set of expansion elements are interleaved with the second set of expansion elements. In an exemplary embodiment, in the first position, the first set of expansion elements are not axially aligned with the second set of expansion elements. In an exemplary embodiment, in the second position, the first set of expansion elements are axially aligned with the second set of expansion elements.

An apparatus for cutting a tubular member has been described that includes a support member; and a plurality of movable cutting elements coupled to the support member. In an exemplary embodiment, the apparatus further includes an actuator coupled to the support member for moving the cutting elements between a first position and a second position; wherein in the first position, the cutting elements do not engage the tubular member; and wherein in the second position, the cutting elements engage the tubular member. In an exemplary embodiment, the apparatus further includes a sensor coupled to the support member for sensing the internal diameter of the tubular member. In an exemplary embodiment, the sensor prevents the cutting elements from being moved to the second position if the internal diameter of the tubular member is less than a predetermined value. In an exemplary embodiment, the cutting elements include a first set of cutting elements; and a second set of cutting elements; wherein the first set of cutting elements are interleaved with the second set of cutting elements. In an exemplary embodiment, in the first position, the first set of cutting elements are not axially aligned with the second set of cutting elements. In an exemplary embodiment, in the second position, the first set of cutting elements are axially aligned with the second set of cutting elements.

An apparatus for engaging a tubular member has been described that includes a support member; and a plurality of movable elements coupled to the support member. In an exemplary embodiment, the apparatus further includes an actuator coupled to the support member for moving the elements between a first position and a second position; wherein in the first position, the elements do not engage the tubular member; and wherein in the second position, the elements engage the tubular member. In an exemplary embodiment, the apparatus further includes a sensor coupled to the support member for sensing the internal diameter of the tubular member. In an exemplary embodiment, the sensor prevents the elements from being moved to the second position if the internal diameter of the tubular member is less than a predetermined value. In an exemplary embodiment, the elements include a first set of elements; and a second set of elements; wherein the first set of elements are interleaved with the second set of elements. In an exemplary embodiment, in the first position, the first set of elements are not axially aligned with the second set of elements. In an exemplary embodiment, in the second position, the first set of elements are axially aligned with the second set of elements.

An apparatus for gripping a tubular member has been described that includes a plurality of movable gripping elements. In an exemplary embodiment, the gripping elements are moveable in a radial direction. In an exemplary embodiment, the gripping elements are moveable in an axial direction. In an exemplary embodiment, the gripping elements are moveable from a first position to a second position; wherein in the first position, the gripping elements do not engage the tubular member; wherein in the second position, the gripping elements do engage the tubular member; and wherein, during the movement from the first position to the second position, the gripping elements move in a radial and an axial direction. In an exemplary embodiment, the gripping elements are moveable from a first position to a second position; wherein in the first position, the gripping elements do not engage the tubular member; wherein in the second position, the gripping elements do engage the tubular member; and wherein, during the movement from the first position to the second position, the gripping elements move in a radial direction. In an exemplary embodiment, the gripping elements are moveable from a first position to a second position; wherein in the first position, the gripping elements do not engage the tubular member; wherein in the second position, the gripping elements do engage the tubular member; and wherein, during the movement from the first position to the second position, the gripping elements move in an axial direction. In an exemplary embodiment, in a first axial direction, the gripping device grips the tubular member; and wherein, in a second axial direction, the gripping device does not grip the tubular member. In an exemplary embodiment, the apparatus further includes an actuator for moving the gripping elements. In an exemplary embodiment, the gripping elements include a plurality of separate and distinct gripping elements.

An actuator has been described that includes a tubular housing; a tubular piston rod movably coupled to and at least partially positioned within the housing; a plurality of annular piston chambers defined by the tubular housing and the tubular piston rod; and a plurality of tubular pistons coupled to the tubular piston rod, each tubular piston movably positioned within a corresponding annular piston chamber. In an exemplary embodiment, the actuator further includes means for transmitting torsional loads between the tubular housing and the tubular piston rod.

An apparatus for controlling a packer has been described that includes a tubular support member; one or more drag blocks releasably coupled to the tubular support member; and a tubular stinger coupled to the tubular support member for engaging the packer. In an exemplary embodiment, the apparatus further includes a tubular sleeve coupled to the drag blocks. In an exemplary embodiment, the tubular support member includes one or more axially aligned teeth for engaging the packer.

A packer has been described that includes a support member defining a passage; a shoe comprising a float valve coupled to an end of the support member; one or more compressible packer elements movably coupled to the support member; and a sliding sleeve valve movably positioned within the passage of the support member.

A method of radially expanding and plastically deforming an expandable tubular member within a borehole having a preexisting wellbore casing has been described that includes positioning the tubular member within the borehole in overlapping relation to the wellbore casing; radially expanding and plastically deforming a portion of the tubular member to form a bell section; and radially expanding and plastically deforming a portion of the tubular member above the bell section comprising a portion of the tubular member that overlaps with the wellbore casing; wherein the inside diameter of the bell section is greater than the inside diameter of the radially expanded and plastically deformed portion of the tubular member above the bell section. In an exemplary embodiment, radially expanding and plastically deforming a portion of the tubular member to form a bell section includes positioning an adjustable expansion device within the expandable tubular member; supporting the expandable tubular member and the adjustable expansion device within the borehole; lowering the adjustable expansion device out of the expandable tubular member; increasing the outside dimension of the adjustable expansion device; and displacing the adjustable expansion device upwardly relative to the expandable tubular member n times to radially expand and plastically deform n portions of the expandable tubular member, wherein n is greater than or equal to 1.

A method for forming a mono diameter wellbore casing has been described that includes positioning an adjustable expansion device within a first expandable tubular member; supporting the first expandable tubular member and the adjustable expansion device within a borehole; lowering the adjustable expansion device out of the first expandable tubular member; increasing the outside dimension of the adjustable expansion device; displacing the adjustable expansion device upwardly relative to the first expandable tubular member m times to radially expand and plastically deform m portions of the first expandable tubular member within the borehole; positioning the adjustable expansion device within a second expandable tubular member; supporting the second expandable tubular member and the adjustable expansion device within the borehole in overlapping relation to the first expandable tubular member; lowering the adjustable expansion device out of the second expandable tubular member; increasing the outside dimension of the adjustable expansion device; and displacing the adjustable expansion device upwardly relative to the second expandable tubular member n times to radially expand and plastically deform n portions of the second expandable tubular member within the borehole.

A method for radially expanding and plastically deforming an expandable tubular member within a borehole has been described that includes positioning an adjustable expansion device within the expandable tubular member; supporting the expandable tubular member and the adjustable expansion device within the borehole; lowering the adjustable expansion device out of the expandable tubular member; increasing the outside dimension of the adjustable expansion device; displacing the adjustable expansion mandrel upwardly relative to the expandable tubular member n times to radially expand and plastically deform n portions of the expandable tubular member within the borehole; and pressurizing an interior region of the expandable tubular member above the adjustable expansion device during the radial expansion and plastic deformation of the expandable tubular member within the borehole.

A method for forming a mono diameter wellbore casing has been described that includes positioning an adjustable expansion device within a first expandable tubular member; supporting the first expandable tubular member and the adjustable expansion device within a borehole; lowering the adjustable expansion device out of the first expandable tubular member; increasing the outside dimension of the adjustable expansion device; displacing the adjustable expansion device upwardly relative to the first expandable tubular member m times to radially expand and plastically deform m portions of the first expandable tubular member within the borehole; pressurizing an interior region of the first expandable tubular member above the adjustable expansion device during the radial expansion and plastic deformation of the first expandable tubular member within the borehole; positioning the adjustable expansion mandrel within a second expandable tubular member; supporting the second expandable tubular member and the adjustable expansion mandrel within the borehole in overlapping relation to the first expandable tubular member; lowering the adjustable expansion mandrel out of the second expandable tubular member; increasing the outside dimension of the adjustable expansion mandrel; displacing the adjustable expansion mandrel upwardly relative to the second expandable tubular member n times to radially expand and plastically deform n portions of the second expandable tubular member within the borehole; and pressurizing an interior region of the second expandable tubular member above the adjustable expansion mandrel during the radial expansion and plastic deformation of the second expandable tubular member within the borehole.

A method for radially expanding and plastically deforming an expandable tubular member within a borehole has been described that includes positioning first and second adjustable expansion devices within the expandable tubular member; supporting the expandable tubular member and the first and second adjustable expansion devices within the borehole; lowering the first adjustable expansion device out of the expandable tubular member; increasing the outside dimension of the first adjustable expansion device; displacing the first adjustable expansion device upwardly relative to the expandable tubular member to radially expand and plastically deform a lower portion of the expandable tubular member; displacing the first adjustable expansion device and the second adjustable expansion device downwardly relative to the expandable tubular member; decreasing the outside dimension of the first adjustable expansion device and increasing the outside dimension of the second adjustable expansion device; displacing the second adjustable expansion device upwardly relative to the expandable tubular member to radially expand and plastically deform portions of the expandable tubular member above the lower portion of the expandable tubular member; wherein the outside dimension of the first adjustable expansion device is greater than the outside dimension of the second adjustable expansion device.

A method for forming a mono diameter wellbore casing has been described that includes positioning first and second adjustable expansion devices within a first expandable tubular member; supporting the first expandable tubular member and the first and second adjustable expansion devices within a borehole; lowering the first adjustable expansion device out of the first expandable tubular member; increasing the outside dimension of the first adjustable expansion device; displacing the first adjustable expansion device upwardly relative to the first expandable tubular member to radially expand and plastically deform a lower portion of the first expandable tubular member; displacing the first adjustable expansion device and the second adjustable expansion device downwardly relative to the first expandable tubular member; decreasing the outside dimension of the first adjustable expansion device and increasing the outside dimension of the second adjustable expansion device; displacing the second adjustable expansion device upwardly relative to the first expandable tubular member to radially expand and plastically deform portions of the first expandable tubular member above the lower portion of the expandable tubular member; positioning first and second adjustable expansion devices within a second expandable tubular member; supporting the first expandable tubular member and the first and second adjustable expansion devices within the borehole in overlapping relation to the first expandable tubular member; lowering the first adjustable expansion device out of the second expandable tubular member; increasing the outside dimension of the first adjustable expansion device; displacing the first adjustable expansion device upwardly relative to the second expandable tubular member to radially expand and plastically deform a lower portion of the second expandable tubular member; displacing the first adjustable expansion device and the second adjustable expansion device downwardly relative to the second expandable tubular member; decreasing the outside dimension of the first adjustable expansion device and increasing the outside dimension of the second adjustable expansion device; and displacing the second adjustable expansion device upwardly relative to the second expandable tubular member to radially expand and plastically deform portions of the second expandable tubular member above the lower portion of the second expandable tubular member; wherein the outside dimension of the first adjustable expansion device is greater than the outside dimension of the second adjustable expansion device.

A method for radially expanding and plastically deforming an expandable tubular member within a borehole has been described that includes positioning first and second adjustable expansion devices within the expandable tubular member; supporting the expandable tubular member and the first and second adjustable expansion devices within the borehole; lowering the first adjustable expansion device out of the expandable tubular member; increasing the outside dimension of the first adjustable expansion device; displacing the first adjustable expansion device upwardly relative to the expandable tubular member to radially expand and plastically deform a lower portion of the expandable tubular member; pressurizing an interior region of the expandable tubular member above the first adjustable expansion device during the radial expansion of the lower portion of the expandable tubular member by the first adjustable expansion device; displacing the first adjustable expansion device and the second adjustable expansion device downwardly relative to the expandable tubular member; decreasing the outside dimension of the first adjustable expansion device and increasing the outside dimension of the second adjustable expansion device; displacing the second adjustable expansion device upwardly relative to the expandable tubular member to radially expand and plastically deform portions of the expandable tubular member above the lower portion of the expandable tubular member; and pressurizing an interior region of the expandable tubular member above the second adjustable expansion device during the radial expansion of the portions of the expandable tubular member above the lower portion of the expandable tubular member by the second adjustable expansion device; wherein the outside dimension of the first adjustable expansion device is greater than the outside dimension of the second adjustable expansion device.

A method for forming a mono diameter wellbore casing has been described that includes positioning first and second adjustable expansion devices within a first expandable tubular member; supporting the first expandable tubular member and the first and second adjustable expansion devices within a borehole; lowering the first adjustable expansion device out of the first expandable tubular member; increasing the outside dimension of the first adjustable expansion device; displacing the first adjustable expansion device upwardly relative to the first expandable tubular member to radially expand and plastically deform a lower portion of the first expandable tubular member; pressurizing an interior region of the first expandable tubular member above the first adjustable expansion device during the radial expansion of the lower portion of the first expandable tubular member by the first adjustable expansion device; displacing the first adjustable expansion device and the second adjustable expansion device downwardly relative to the first expandable tubular member; decreasing the outside dimension of the first adjustable expansion device and increasing the outside dimension of the second adjustable expansion device; displacing the second adjustable expansion device upwardly relative to the first expandable tubular member to radially expand and plastically deform portions of the first expandable tubular member above the lower portion of the expandable tubular member; pressurizing an interior region of the first expandable tubular member above the second adjustable expansion device during the radial expansion of the portions of the first expandable tubular member above the lower portion of the first expandable tubular member by the second adjustable expansion device; positioning first and second adjustable expansion devices within a second expandable tubular member; supporting the first expandable tubular member and the first and second adjustable expansion devices within the borehole in overlapping relation to the first expandable tubular member; lowering the first adjustable expansion device out of the second expandable tubular member; increasing the outside dimension of the first adjustable expansion device; displacing the first adjustable expansion device upwardly relative to the second expandable tubular member to radially expand and plastically deform a lower portion of the second expandable tubular member; pressurizing an interior region of the second expandable tubular member above the first adjustable expansion device during the radial expansion of the lower portion of the second expandable tubular member by the first adjustable expansion device; displacing the first adjustable expansion device and the second adjustable expansion device downwardly relative to the second expandable tubular member; decreasing the outside dimension of the first adjustable expansion device and increasing the outside dimension of the second adjustable expansion device; displacing the second adjustable expansion device upwardly relative to the second expandable tubular member to radially expand and plastically deform portions of the second expandable tubular member above the lower portion of the second expandable tubular member; and pressurizing an interior region of the second expandable tubular member above the second adjustable expansion device during the radial expansion of the portions of the second expandable tubular member above the lower portion of the second expandable tubular member by the second adjustable expansion device; wherein the outside dimension of the first adjustable expansion device is greater than the outside dimension of the second adjustable expansion device.

A method for radially expanding and plastically deforming an expandable tubular member within a borehole has been described that includes supporting the expandable tubular member, an hydraulic actuator, and an adjustable expansion device within the borehole; increasing the size of the adjustable expansion device; and displacing the adjustable expansion device upwardly relative to the expandable tubular member using the hydraulic actuator to radially expand and plastically deform a portion of the expandable tubular member. In an exemplary embodiment, the method further includes reducing the size of the adjustable expansion device after the portion of the expandable tubular member has been radially expanded and plastically deformed. In an exemplary embodiment, the method further includes fluidicly sealing the radially expanded and plastically deformed end of the expandable tubular member after reducing the size of the adjustable expansion device. In an exemplary embodiment, the method further includes permitting the position of the expandable tubular member to float relative to the position of the hydraulic actuator after fluidicly sealing the radially expanded and plastically deformed end of the expandable tubular member. In an exemplary embodiment, the method further includes injecting a hardenable fluidic sealing material into an annulus between the expandable tubular member and a preexisting structure after permitting the position of the expandable tubular member to float relative to the position of the hydraulic actuator. In an exemplary embodiment, the method further includes increasing the size of the adjustable expansion device after permitting the position of the expandable tubular member to float relative to the position of the hydraulic actuator. In an exemplary embodiment, the method further includes displacing the adjustable expansion cone upwardly relative to the expandable tubular member to radially expand and plastically deform another portion of the expandable tubular member. In an exemplary embodiment, the method further includes if the end of the other portion of the expandable tubular member overlaps with a preexisting structure, then not permitting the position of the expandable tubular member to float relative to the position of the hydraulic actuator; and displacing the adjustable expansion cone upwardly relative to the expandable tubular member using the hydraulic actuator to radially expand and plastically deform the end of the other portion of the expandable tubular member that overlaps with the preexisting structure.

A method for forming a mono diameter wellbore casing within a borehole that includes a preexisting wellbore casing has been described that includes supporting the expandable tubular member, an hydraulic actuator, and an adjustable expansion device within the borehole; increasing the size of the adjustable expansion device; displacing the adjustable expansion device upwardly relative to the expandable tubular member using the hydraulic actuator to radially expand and plastically deform a portion of the expandable tubular member; and displacing the adjustable expansion device upwardly relative to the expandable tubular member to radially expand and plastically deform the remaining portion of the expandable tubular member and a portion of the preexisting wellbore casing that overlaps with an end of the remaining portion of the expandable tubular member. In an exemplary embodiment, the method further includes reducing the size of the adjustable expansion device after the portion of the expandable tubular member has been radially expanded and plastically deformed. In an exemplary embodiment, the method further includes fluidicly sealing the radially expanded and plastically deformed end of the expandable tubular member after reducing the size of the adjustable expansion device. In an exemplary embodiment, the method further includes permitting the position of the expandable tubular member to float relative to the position of the hydraulic actuator after fluidicly sealing the radially expanded and plastically deformed end of the expandable tubular member. In an exemplary embodiment, the method further includes injecting a hardenable fluidic sealing material into an annulus between the expandable tubular member and the borehole after permitting the position of the expandable tubular member to float relative to the position of the hydraulic actuator. In an exemplary embodiment, the method further includes increasing the size of the adjustable expansion device after permitting the position of the expandable tubular member to float relative to the position of the hydraulic actuator. In an exemplary embodiment, the method further includes displacing the adjustable expansion cone upwardly relative to the expandable tubular member to radially expand and plastically deform the remaining portion of the expandable tubular member. In an exemplary embodiment, the method further includes not permitting the position of the expandable tubular member to float relative to the position of the hydraulic actuator; and displacing the adjustable expansion cone upwardly relative to the expandable tubular member using the hydraulic actuator to radially expand and plastically deform the end of the remaining portion of the expandable tubular member that overlaps with the preexisting wellbore casing after not permitting the position of the expandable tubular member to float relative to the position of the hydraulic actuator.

A method of radially expanding and plastically deforming a tubular member has been described that includes positioning the tubular member within a preexisting structure; radially expanding and plastically deforming a lower portion of the tubular member to form a bell section; and radially expanding and plastically deforming a portion of the tubular member above the bell section. In an exemplary embodiment, positioning the tubular member within a preexisting structure includes locking the tubular member to an expansion device. In an exemplary embodiment, the outside diameter of the expansion device is less than the inside diameter of the tubular member. In an exemplary embodiment, the expansion device is positioned within the tubular member. In an exemplary embodiment, the expansion device includes an adjustable expansion device. In an exemplary embodiment, the adjustable expansion device is adjustable to a plurality of sizes. In an exemplary embodiment, the expansion device includes a plurality of expansion devices. In an exemplary embodiment, at least one of the expansion devices includes an adjustable expansion device. In an exemplary embodiment, at least one of the adjustable expansion device is adjustable to a plurality of sizes. In an exemplary embodiment, radially expanding and plastically deforming a lower portion of the tubular member to form a bell section includes lowering an expansion device out of an end of the tubular member; and pulling the expansion device through the end of the tubular member. In an exemplary embodiment, lowering an expansion device out of an end of the tubular member includes lowering the expansion device out of the end of the tubular member; and adjusting the size of the expansion device. In an exemplary embodiment, the adjustable expansion device is adjustable to a plurality of sizes. In an exemplary embodiment, the expansion device includes a plurality of adjustable expansion devices. In an exemplary embodiment, at least one of the adjustable expansion devices is adjustable to a plurality of sizes. In an exemplary embodiment, pulling the expansion device through the end of the tubular member includes gripping the tubular member; and pulling an expansion device through an end of the tubular member. In an exemplary embodiment, gripping the tubular member includes permitting axial displacement of the tubular member in a first direction; and not permitting axial displacement of the tubular member in a second direction. In an exemplary embodiment, pulling the expansion device through the end of the tubular member includes pulling the expansion device through the end of the tubular member using an actuator. In an exemplary embodiment, radially expanding and plastically deforming a portion of the tubular member above the bell section includes lowering an expansion device out of an end of the tubular member; and pulling the expansion device through the end of the tubular member. In an exemplary embodiment, lowering an expansion device out of an end of the tubular member includes lowering the expansion device out of the end of the tubular member; and adjusting the size of the expansion device. In an exemplary embodiment, the adjustable expansion device is adjustable to a plurality of sizes. In an exemplary embodiment, the expansion device includes a plurality of adjustable expansion devices. In an exemplary embodiment, at least one of the adjustable expansion devices is adjustable to a plurality of sizes. In an exemplary embodiment, pulling the expansion device through the end of the tubular member includes gripping the tubular member; and pulling an expansion device through an end of the tubular member. In an exemplary embodiment, gripping the tubular member includes permitting axial displacement of the tubular member in a first direction; and not permitting axial displacement of the tubular member in a second direction. In an exemplary embodiment, pulling the expansion device through the end of the tubular member includes pulling the expansion device through the end of the tubular member using an actuator. In an exemplary embodiment, pulling the expansion device through the end of the tubular member includes pulling the expansion device through the end of the tubular member using fluid pressure. In an exemplary embodiment, pulling the expansion device through the end of the tubular member using fluid pressure includes pressurizing an annulus within the tubular member above the expansion device. In an exemplary embodiment, radially expanding and plastically deforming a portion of the tubular member above the bell section includes fluidicly sealing an end of the tubular member; and pulling the expansion device through the tubular member. In an exemplary embodiment, the expansion device is adjustable. In an exemplary embodiment, the expansion device is adjustable to a plurality of sizes. In an exemplary embodiment, the expansion device comprises a plurality of adjustable expansion devices. In an exemplary embodiment, at least one of the adjustable expansion devices is adjustable to a plurality of sizes. In an exemplary embodiment, pulling the expansion device through the end of the tubular member includes gripping the tubular member; and pulling an expansion device through an end of the tubular member. In an exemplary embodiment, gripping the tubular member includes permitting axial displacement of the tubular member in a first direction; and not permitting axial displacement of the tubular member in a second direction. In an exemplary embodiment, pulling the expansion device through the end of the tubular member includes pulling the expansion device through the end of the tubular member using an actuator. In an exemplary embodiment, pulling the expansion device through the end of the tubular member includes pulling the expansion device through the end of the tubular member using fluid pressure. In an exemplary embodiment, pulling the expansion device through the end of the tubular member using fluid pressure includes pressurizing an annulus within the tubular member above the expansion device. In an exemplary embodiment, radially expanding and plastically deforming a portion of the tubular member above the bell section includes overlapping the portion of the tubular member above the bell section with an end of a preexisting tubular member; and pulling an expansion device through the overlapping portions of the tubular member and the preexisting tubular member. In an exemplary embodiment, the expansion device is adjustable. In an exemplary embodiment, the expansion device is adjustable to a plurality of sizes. In an exemplary embodiment, the expansion device includes a plurality of adjustable expansion devices. In an exemplary embodiment, at least one of the adjustable expansion devices is adjustable to a plurality of sizes. In an exemplary embodiment, pulling the expansion device through the overlapping portions of the tubular member and the preexisting tubular member includes gripping the tubular member; and pulling the expansion device through the overlapping portions of the tubular member and the preexisting tubular member. In an exemplary embodiment, gripping the tubular member includes permitting axial displacement of the tubular member in a first direction; and not permitting axial displacement of the tubular member in a second direction. In an exemplary embodiment, pulling the expansion device through the overlapping portions of the tubular member and the preexisting tubular member includes pulling the expansion device through the overlapping portions of the tubular member and the preexisting tubular member using an actuator. In an exemplary embodiment, pulling the expansion device through the overlapping portions of the tubular member and the preexisting tubular member includes pulling the expansion device through the overlapping portions of the tubular member and the preexisting tubular member using fluid pressure. In an exemplary embodiment, pulling the expansion device through the overlapping portions of the tubular member and the preexisting tubular member using fluid pressure includes pressurizing an annulus within the tubular member above the expansion device. In an exemplary embodiment, the method further includes cutting an end of the portion of the tubular member that overlaps with the preexisting tubular member. In an exemplary embodiment, the method further includes removing the cut off end of the expandable tubular member from the preexisting structure. In an exemplary embodiment, the method further includes injecting a hardenable fluidic sealing material into an annulus between the expandable tubular member and the preexisting structure. In an exemplary embodiment, the method further includes cutting off an end of the expandable tubular member. In an exemplary embodiment, the method further includes removing the cut off end of the expandable tubular member from the preexisting structure.

A method of radially expanding and plastically deforming a tubular member has been described that includes applying internal pressure to the inside surface of the tubular member at a plurality of discrete location separated from one another.

A system for radially expanding and plastically deforming an expandable tubular member within a borehole having a preexisting wellbore casing has been described that includes means for positioning the tubular member within the borehole in overlapping relation to the wellbore casing; means for radially expanding and plastically deforming a portion of the tubular member to form a bell section; and means for radially expanding and plastically deforming a portion of the tubular member above the bell section comprising a portion of the tubular member that overlaps with the wellbore casing; wherein the inside diameter of the bell section is greater than the inside diameter of the radially expanded and plastically deformed portion of the tubular member above the bell section. In an exemplary embodiment, means for radially expanding and plastically deforming a portion of the tubular member to form a bell section includes means for positioning an adjustable expansion device within the expandable tubular member; means for supporting the expandable tubular member and the adjustable expansion device within the borehole; means for lowering the adjustable expansion device out of the expandable tubular member; means for increasing the outside dimension of the adjustable expansion device; and means for displacing the adjustable expansion device upwardly relative to the expandable tubular member n times to radially expand and plastically deform n portions of the expandable tubular member, wherein n is greater than or equal to 1.

A system for forming a mono diameter wellbore casing has been described that includes means for positioning an adjustable expansion device within a first expandable tubular member; means for supporting the first expandable tubular member and the adjustable expansion device within a borehole; means for lowering the adjustable expansion device out of the first expandable tubular member; means for increasing the outside dimension of the adjustable expansion device; means for displacing the adjustable expansion device upwardly relative to the first expandable tubular member m times to radially expand and plastically deform m portions of the first expandable tubular member within the borehole; means for positioning the adjustable expansion device within a second expandable tubular member; means for supporting the second expandable tubular member and the adjustable expansion device within the borehole in overlapping relation to the first expandable tubular member; means for lowering the adjustable expansion device out of the second expandable tubular member; means for increasing the outside dimension of the adjustable expansion device; and means for displacing the adjustable expansion device upwardly relative to the second expandable tubular member n times to radially expand and plastically deform n portions of the second expandable tubular member within the borehole.

A system for radially expanding and plastically deforming an expandable tubular member within a borehole has been described that includes means for positioning an adjustable expansion device within the expandable tubular member; means for supporting the expandable tubular member and the adjustable expansion device within the borehole; means for lowering the adjustable expansion device out of the expandable tubular member; means for increasing the outside dimension of the adjustable expansion device; means for displacing the adjustable expansion mandrel upwardly relative to the expandable tubular member n times to radially expand and plastically deform n portions of the expandable tubular member within the borehole; and means for pressurizing an interior region of the expandable tubular member above the adjustable expansion device during the radial expansion and plastic deformation of the expandable tubular member within the borehole.

A system for forming a mono diameter wellbore casing has been described that includes means for positioning an adjustable expansion device within a first expandable tubular member; means for supporting the first expandable tubular member and the adjustable expansion device within a borehole; means for lowering the adjustable expansion device out of the first expandable tubular member; means for increasing the outside dimension of the adjustable expansion device; means for displacing the adjustable expansion device upwardly relative to the first expandable tubular member m times to radially expand and plastically deform m portions of the first expandable tubular member within the borehole; means for pressurizing an interior region of the first expandable tubular member above the adjustable expansion device during the radial expansion and plastic deformation of the first expandable tubular member within the borehole; means for positioning the adjustable expansion mandrel within a second expandable tubular member; means for supporting the second expandable tubular member and the adjustable expansion mandrel within the borehole in overlapping relation to the first expandable tubular member; means for lowering the adjustable expansion mandrel out of the second expandable tubular member; means for increasing the outside dimension of the adjustable expansion mandrel; means for displacing the adjustable expansion mandrel upwardly relative to the second expandable tubular member n times to radially expand and plastically deform n portions of the second expandable tubular member within the borehole; and means for pressurizing an interior region of the second expandable tubular member above the adjustable expansion mandrel during the radial expansion and plastic deformation of the second expandable tubular member within the borehole.

A system for radially expanding and plastically deforming an expandable tubular member within a borehole has been described that includes means for positioning first and second adjustable expansion devices within the expandable tubular member; means for supporting the expandable tubular member and the first and second adjustable expansion devices within the borehole; means for lowering the first adjustable expansion device out of the expandable tubular member; means for increasing the outside dimension of the first adjustable expansion device; means for displacing the first adjustable expansion device upwardly relative to the expandable tubular member to radially expand and plastically deform a lower portion of the expandable tubular member; means for displacing the first adjustable expansion device and the second adjustable expansion device downwardly relative to the expandable tubular member; means for decreasing the outside dimension of the first adjustable expansion device and increasing the outside dimension of the second adjustable expansion device; means for displacing the second adjustable expansion device upwardly relative to the expandable tubular member to radially expand and plastically deform portions of the expandable tubular member above the lower portion of the expandable tubular member; wherein the outside dimension of the first adjustable expansion device is greater than the outside dimension of the second adjustable expansion device.

A system for forming a mono diameter wellbore casing has been described that includes means for positioning first and second adjustable expansion devices within a first expandable tubular member; means for supporting the first expandable tubular member and the first and second adjustable expansion devices within a borehole; means for lowering the first adjustable expansion device out of the first expandable tubular member; means for increasing the outside dimension of the first adjustable expansion device; displacing the first adjustable expansion device upwardly relative to the first expandable tubular member to radially expand and plastically deform a lower portion of the first expandable tubular member; means for displacing the first adjustable expansion device and the second adjustable expansion device downwardly relative to the first expandable tubular member; means for decreasing the outside dimension of the first adjustable expansion device and increasing the outside dimension of the second adjustable expansion device; means for displacing the second adjustable expansion device upwardly relative to the first expandable tubular member to radially expand and plastically deform portions of the first expandable tubular member above the lower portion of the expandable tubular member; means for positioning first and second adjustable expansion devices within a second expandable tubular member; means for supporting the first expandable tubular member and the first and second adjustable expansion devices within the borehole in overlapping relation to the first expandable tubular member; means for lowering the first adjustable expansion device out of the second expandable tubular member; means for increasing the outside dimension of the first adjustable expansion device; means for displacing the adjustable expansion device upwardly relative to the second expandable tubular member to radially expand and plastically deform a lower portion of the second expandable tubular member; means for displacing the first adjustable expansion device and the second adjustable expansion device downwardly relative to the second expandable tubular member; means for decreasing the outside dimension of the first adjustable expansion device and increasing the outside dimension of the second adjustable expansion device; and means for displacing the second adjustable expansion device upwardly relative to the second expandable tubular member to radially expand and plastically deform portions of the second expandable tubular member above the lower portion of the second expandable tubular member; wherein the outside dimension of the first adjustable expansion device is greater than the outside dimension of the second adjustable expansion device.

A system for radially expanding and plastically deforming an expandable tubular member within a borehole has been described that includes means for positioning first and second adjustable expansion devices within the expandable tubular member; means for supporting the expandable tubular member and the first and second adjustable expansion devices within the borehole; means for lowering the first adjustable expansion device out of the expandable tubular member; means for increasing the outside dimension of the first adjustable expansion device; means for displacing the first adjustable expansion device upwardly relative to the expandable tubular member to radially expand and plastically deform a lower portion of the expandable tubular member; means for pressurizing an interior region of the expandable tubular member above the first adjustable expansion device during the radial expansion of the lower portion of the expandable tubular member by the first adjustable expansion device; means for displacing the first adjustable expansion device and the second adjustable expansion device downwardly relative to the expandable tubular member; means for decreasing the outside dimension of the first adjustable expansion device and increasing the outside dimension of the second adjustable expansion device; means for displacing the second adjustable expansion device upwardly relative to the expandable tubular member to radially expand and plastically deform portions of the expandable tubular member above the lower portion of the expandable tubular member; and means for pressurizing an interior region of the expandable tubular member above the second adjustable expansion device during the radial expansion of the portions of the expandable tubular member above the lower portion of the expandable tubular member by the second adjustable expansion device; wherein the outside dimension of the first adjustable expansion device is greater than the outside dimension of the second adjustable expansion device.

A system for forming a mono diameter wellbore casing has been described that includes means for positioning first and second adjustable expansion devices within a first expandable tubular member; means for supporting the first expandable tubular member and the first and second adjustable expansion devices within a borehole; means for lowering the first adjustable expansion device out of the first expandable tubular member; means for increasing the outside dimension of the first adjustable expansion device; means for displacing the first adjustable expansion device upwardly relative to the first expandable tubular member to radially expand and plastically deform a lower portion of the first expandable tubular member; means for pressurizing an interior region of the first expandable tubular member above the first adjustable expansion device during the radial expansion of the lower portion of the first expandable tubular member by the first adjustable expansion device; means for displacing the first adjustable expansion device and the second adjustable expansion device downwardly relative to the first expandable tubular member; means for decreasing the outside dimension of the first adjustable expansion device and increasing the outside dimension of the second adjustable expansion device; means for displacing the second adjustable expansion device upwardly relative to the first expandable tubular member to radially expand and plastically deform portions of the first expandable tubular member above the lower portion of the expandable tubular member; means for pressurizing an interior region of the first expandable tubular member above the second adjustable expansion device during the radial expansion of the portions of the first expandable tubular member above the lower portion of the first expandable tubular member by the second adjustable expansion device; means for positioning first and second adjustable expansion devices within a second expandable tubular member; means for supporting the first expandable tubular member and the first and second adjustable expansion devices within the borehole in overlapping relation to the first expandable tubular member; means for lowering the first adjustable expansion device out of the second expandable tubular member; means for increasing the outside dimension of the first adjustable expansion device; means for displacing the first adjustable expansion device upwardly relative to the second expandable tubular member to radially expand and plastically deform a lower portion of the second expandable tubular member; means for pressurizing an interior region of the second expandable tubular member above the first adjustable expansion device during the radial expansion of the lower portion of the second expandable tubular member by the first adjustable expansion device; means for displacing the first adjustable expansion device and the second adjustable expansion device downwardly relative to the second expandable tubular member; means for decreasing the outside dimension of the first adjustable expansion device and increasing the outside dimension of the second adjustable expansion device; means for displacing the second adjustable expansion device upwardly relative to the second expandable tubular member to radially expand and plastically deform portions of the second expandable tubular member above the lower portion of the second expandable tubular member; and means for pressurizing an interior region of the second expandable tubular member above the second adjustable expansion device during the radial expansion of the portions of the second expandable tubular member above the lower portion of the second expandable tubular member by the second adjustable expansion device; wherein the outside dimension of the first adjustable expansion device is greater than the outside dimension of the second adjustable expansion device.

A system for radially expanding and plastically deforming an expandable tubular member within a borehole has been described that includes means for supporting the expandable tubular member, an hydraulic actuator, and an adjustable expansion device within the borehole; means for increasing the size of the adjustable expansion device; and means for displacing the adjustable expansion device upwardly relative to the expandable tubular member using the hydraulic actuator to radially expand and plastically deform a portion of the expandable tubular member. In an exemplary embodiment, the system further includes means for reducing the size of the adjustable expansion device after the portion of the expandable tubular member has been radially expanded and plastically deformed. In an exemplary embodiment, the system further includes means for fluidicly sealing the radially expanded and plastically deformed end of the expandable tubular member after reducing the size of the adjustable expansion device. In an exemplary embodiment, the system further includes means for permitting the position of the expandable tubular member to float relative to the position of the hydraulic actuator after fluidicly sealing the radially expanded and plastically deformed end of the expandable tubular member. In an exemplary embodiment, the system further includes means for injecting a hardenable fluidic sealing material into an annulus between the expandable tubular member and a preexisting structure after permitting the position of the expandable tubular member to float relative to the position of the hydraulic actuator. In an exemplary embodiment, the system further includes means for increasing the size of the adjustable expansion device after permitting the position of the expandable tubular member to float relative to the position of the hydraulic actuator. In an exemplary embodiment, system further includes means for displacing the adjustable expansion cone upwardly relative to the expandable tubular member to radially expand and plastically deform another portion of the expandable tubular member. In an exemplary embodiment, the system further includes if the end of the other portion of the expandable tubular member overlaps with a preexisting structure, then means for not permitting the position of the expandable tubular member to float relative to the position of the hydraulic actuator; and means for displacing the adjustable expansion cone upwardly relative to the expandable tubular member using the hydraulic actuator to radially expand and plastically deform the end of the other portion of the expandable tubular member that overlaps with the preexisting structure.

A system for forming a mono diameter wellbore casing within a borehole that includes a preexisting wellbore casing has been described that includes means for supporting the expandable tubular member, an hydraulic actuator, and an adjustable expansion device within the borehole; means for increasing the size of the adjustable expansion device; means for displacing the adjustable expansion device upwardly relative to the expandable tubular member using the hydraulic actuator to radially expand and plastically deform a portion of the expandable tubular member; and means for displacing the adjustable expansion device upwardly relative to the expandable tubular member to radially expand and plastically deform the remaining portion of the expandable tubular member and a portion of the preexisting wellbore casing that overlaps with an end of the remaining portion of the expandable tubular member. In an exemplary embodiment, the system further includes means for reducing the size of the adjustable expansion device after the portion of the expandable tubular member has been radially expanded and plastically deformed. In an exemplary embodiment, the system further includes means for fluidicly sealing the radially expanded and plastically deformed end of the expandable tubular member after reducing the size of the adjustable expansion device. In an exemplary embodiment, the system further includes means for permitting the position of the expandable tubular member to float relative to the position of the hydraulic actuator after fluidicly sealing the radially expanded and plastically deformed end of the expandable tubular member. In an exemplary embodiment, the system further includes means for injecting a hardenable fluidic sealing material into an annulus between the expandable tubular member and the borehole after permitting the position of the expandable tubular member to float relative to the position of the hydraulic actuator. In an exemplary embodiment, the system further includes means for increasing the size of the adjustable expansion device after permitting the position of the expandable tubular member to float relative to the position of the hydraulic actuator. In an exemplary embodiment, the system further includes means for displacing the adjustable expansion cone upwardly relative to the expandable tubular member to radially expand and plastically deform the remaining portion of the expandable tubular member. In an exemplary embodiment, the system further includes means for not permitting the position of the expandable tubular member to float relative to the position of the hydraulic actuator; and means for displacing the adjustable expansion cone upwardly relative to the expandable tubular member using the hydraulic actuator to radially expand and plastically deform the end of the remaining portion of the expandable tubular member that overlaps with the preexisting wellbore casing after not permitting the position of the expandable tubular member to float relative to the position of the hydraulic actuator.

A system for radially expanding and plastically deforming a tubular member has been described that includes means for positioning the tubular member within a preexisting structure; means for radially expanding and plastically deforming a lower portion of the tubular member to form a bell section; and means for radially expanding and plastically deforming a portion of the tubular member above the bell section. In an exemplary embodiment, positioning the tubular member within a preexisting structure includes means for locking the tubular member to an expansion device. In an exemplary embodiment, the outside diameter of the expansion device is less than the inside diameter of the tubular member. In an exemplary embodiment, the expansion device is positioned within the tubular member. In an exemplary embodiment, the expansion device includes an adjustable expansion device. In an exemplary embodiment, the adjustable expansion device is adjustable to a plurality of sizes. In an exemplary embodiment, the expansion device includes a plurality of expansion devices. In an exemplary embodiment, at least one of the expansion devices includes an adjustable expansion device. In an exemplary embodiment, at least one of the adjustable expansion device is adjustable to a plurality of sizes. In an exemplary embodiment, means for radially expanding and plastically deforming a lower portion of the tubular member to form a bell section includes means for lowering an expansion device out of an end of the tubular member; and means for pulling the expansion device through the end of the tubular member. In an exemplary embodiment, means for lowering an expansion device out of an end of the tubular member includes means for lowering the expansion device out of the end of the tubular member; and means for adjusting the size of the expansion device. In an exemplary embodiment, the adjustable expansion device is adjustable to a plurality of sizes. In an exemplary embodiment, the expansion device includes a plurality of adjustable expansion devices. In an exemplary embodiment, at least one of the adjustable expansion devices is adjustable to a plurality of sizes. In an exemplary embodiment, means for pulling the expansion device through the end of the tubular member includes means for gripping the tubular member; and means for pulling an expansion device through an end of the tubular member. In an exemplary embodiment, means for gripping the tubular member includes means for permitting axial displacement of the tubular member in a first direction; and means for not permitting axial displacement of the tubular member in a second direction. In an exemplary embodiment, means for pulling the expansion device through the end of the tubular member includes means for pulling the expansion device through the end of the tubular member using an actuator. In an exemplary embodiment, means for radially expanding and plastically deforming a portion of the tubular member above the bell section includes means for lowering an expansion device out of an end of the tubular member; and means for pulling the expansion device through the end of the tubular member. In an exemplary embodiment, means for lowering an expansion device out of an end of the tubular member includes means for lowering the expansion device out of the end of the tubular member; and means for adjusting the size of the expansion device. In an exemplary embodiment, the adjustable expansion device is adjustable to a plurality of sizes. In an exemplary embodiment, the expansion device comprises a plurality of adjustable expansion devices. In an exemplary embodiment, at least one of the adjustable expansion devices is adjustable to a plurality of sizes. In an exemplary embodiment, means for pulling the expansion device through the end of the tubular member includes means for gripping the tubular member; and means for pulling an expansion device through an end of the tubular member. In an exemplary embodiment, means for gripping the tubular member includes means for permitting axial displacement of the tubular member in a first direction; and means for not permitting axial displacement of the tubular member in a second direction. In an exemplary embodiment, means for pulling the expansion device through the end of the tubular member includes means for pulling the expansion device through the end of the tubular member using an actuator. In an exemplary embodiment, means for pulling the expansion device through the end of the tubular member includes means for pulling the expansion device through the end of the tubular member using fluid pressure. In an exemplary embodiment, means for pulling the expansion device through the end of the tubular member using fluid pressure includes means for pressurizing an annulus within the tubular member above the expansion device. In an exemplary embodiment, means for radially expanding and plastically deforming a portion of the tubular member above the bell section includes means for fluidicly sealing an end of the tubular member; and means for pulling the expansion device through the tubular member. In an exemplary embodiment, the expansion device is adjustable. In an exemplary embodiment, the expansion device is adjustable to a plurality of sizes. In an exemplary embodiment, the expansion device includes a plurality of adjustable expansion devices. In an exemplary embodiment, at least one of the adjustable expansion devices is adjustable to a plurality of sizes. In an exemplary embodiment, means for pulling the expansion device through the end of the tubular member includes means for gripping the tubular member; and means for pulling an expansion device through an end of the tubular member. In an exemplary embodiment, means for gripping the tubular member includes means for permitting axial displacement of the tubular member in a first direction; and means for not permitting axial displacement of the tubular member in a second direction. In an exemplary embodiment, means for pulling the expansion device through the end of the tubular member includes means for pulling the expansion device through the end of the tubular member using an actuator. In an exemplary embodiment, means for pulling the expansion device through the end of the tubular member includes means for pulling the expansion device through the end of the tubular member using fluid pressure. In an exemplary embodiment, means for pulling the expansion device through the end of the tubular member using fluid pressure includes means for pressurizing an annulus within the tubular member above the expansion device. In an exemplary embodiment, means for radially expanding and plastically deforming a portion of the tubular member above the bell section includes means for overlapping the portion of the tubular member above the bell section with an end of a preexisting tubular member; and means for pulling an expansion device through the overlapping portions of the tubular member and the preexisting tubular member. In an exemplary embodiment, the expansion device is adjustable. In an exemplary embodiment, the expansion device is adjustable to a plurality of sizes. In an exemplary embodiment, the expansion device includes a plurality of adjustable expansion devices. In an exemplary embodiment, at least one of the adjustable expansion devices is adjustable to a plurality of sizes. In an exemplary embodiment, means for pulling the expansion device through the overlapping portions of the tubular member and the preexisting tubular member includes means for gripping the tubular member; and means for pulling the expansion device through the overlapping portions of the tubular member and the preexisting tubular member. In an exemplary embodiment, means for gripping the tubular member includes means for permitting axial displacement of the tubular member in a first direction; and means for not permitting axial displacement of the tubular member in a second direction. In an exemplary embodiment, means for pulling the expansion device through the overlapping portions of the tubular member and the preexisting tubular member includes means for pulling the expansion device through the overlapping portions of the tubular member and the preexisting tubular member using an actuator. In an exemplary embodiment, means for pulling the expansion device through the overlapping portions of the tubular member and the preexisting tubular member includes means for pulling the expansion device through the overlapping portions of the tubular member and the preexisting tubular member using fluid pressure. In an exemplary embodiment, means for pulling the expansion device through the overlapping portions of the tubular member and the preexisting tubular member using fluid pressure includes means for pressurizing an annulus within the tubular member above the expansion device. In an exemplary embodiment, the system further includes means for cutting an end of the portion of the tubular member that overlaps with the preexisting tubular member. In an exemplary embodiment, the system further includes means for removing the cut off end of the expandable tubular member from the preexisting structure. In an exemplary embodiment, the system further includes means for injecting a hardenable fluidic sealing material into an annulus between the expandable tubular member and the preexisting structure. In an exemplary embodiment, the system further includes means for cutting off an end of the expandable tubular member. In an exemplary embodiment, the system further includes means for removing the cut off end of the expandable tubular member from the preexisting structure.

A system of radially expanding and plastically deforming a tubular member has been described that includes a support member; and means for applying internal pressure to the inside surface of the tubular member at a plurality of discrete location separated from one another coupled to the support member.

A method of cutting a tubular member has been described that includes positioning a plurality of cutting elements within the tubular member; and bringing the cutting elements into engagement with the tubular member. In an exemplary embodiment, the cutting elements include a first group of cutting elements; and a second group of cutting elements; wherein the first group of cutting elements are interleaved with the second group of cutting elements. In an exemplary embodiment, bringing the cutting elements into engagement with the tubular member includes bringing the cutting elements into axial alignment. In an exemplary embodiment, bringing the cutting elements into engagement with the tubular member further includes pivoting the cutting elements. In an exemplary embodiment, bringing the cutting elements into engagement with the tubular member further includes translating the cutting elements. In an exemplary embodiment, bringing the cutting elements into engagement with the tubular member further includes pivoting the cutting elements; and translating the cutting elements. In an exemplary embodiment, bringing the cutting elements into engagement with the tubular member includes rotating the cutting elements about a common axis. In an exemplary embodiment, bringing the cutting elements into engagement with the tubular member includes pivoting the cutting elements about corresponding axes; translating the cutting elements; and rotating the cutting elements about a common axis. In an exemplary embodiment, the method further includes preventing the cutting elements from coming into engagement with the tubular member if the inside diameter of the tubular member is less than a predetermined value. In an exemplary embodiment, preventing the cutting elements from coming into engagement with the tubular member if the inside diameter of the tubular member is less than a predetermined value includes sensing the inside diameter of the tubular member.

A method of gripping a tubular member has been described that includes positioning a plurality of gripping elements within the tubular member; bringing the gripping elements into engagement with the tubular member. In an exemplary embodiment, bringing the gripping elements into engagement with the tubular member includes displacing the gripping elements in an axial direction; and displacing the gripping elements in a radial direction. In an exemplary embodiment, the method further includes biasing the gripping elements against engagement with the tubular member.

A method of operating an actuator has been described that includes pressurizing a plurality of pressure chamber. In an exemplary embodiment, the method further includes transmitting torsional loads.

A method of injecting a hardenable fluidic sealing material into an annulus between a tubular member and a preexisting structure has been described that includes positioning the tubular member into the preexisting structure; sealing off an end of the tubular member; operating a valve within the end of the tubular member; and injecting a hardenable fluidic sealing material through the valve into the annulus between the tubular member and the preexisting structure.

A system for cutting a tubular member has been described that includes means for positioning a plurality of cutting elements within the tubular member; and means for bringing the cutting elements into engagement with the tubular member. In an exemplary embodiment, the cutting elements include a first group of cutting elements; and a second group of cutting elements; wherein the first group of cutting elements are interleaved with the second group of cutting elements. In an exemplary embodiment, means for bringing the cutting elements into engagement with the tubular member includes means for bringing the cutting elements into axial alignment. In an exemplary embodiment, means for bringing the cutting elements into engagement with the tubular member further includes means for pivoting the cutting elements. In an exemplary embodiment, means for bringing the cutting elements into engagement with the tubular member further includes means for translating the cutting elements. In an exemplary embodiment, means for bringing the cutting elements into engagement with the tubular member further includes means for pivoting the cutting elements; and means for translating the cutting elements. In an exemplary embodiment, means for bringing the cutting elements into engagement with the tubular member includes means for rotating the cutting elements about a common axis. In an exemplary embodiment, means for bringing the cutting elements into engagement with the tubular member includes means for pivoting the cutting elements about corresponding axes; means for translating the cutting elements; and means for rotating the cutting elements about a common axis. In an exemplary embodiment, the system further includes means for preventing the cutting elements from coming into engagement with the tubular member if the inside diameter of the tubular member is less than a predetermined value. In an exemplary embodiment, means for preventing the cutting elements from coming into engagement with the tubular member if the inside diameter of the tubular member is less than a predetermined value includes means for sensing the inside diameter of the tubular member.

A system for gripping a tubular member has been described that includes means for positioning a plurality of gripping elements within the tubular member; and means for bringing the gripping elements into engagement with the tubular member. In an exemplary embodiment, means for bringing the gripping elements into engagement with the tubular member includes means for displacing the gripping elements in an axial direction; and means for displacing the gripping elements in a radial direction. In an exemplary embodiment, the system further includes means for biasing the gripping elements against engagement with the tubular member.

An actuator system has been described that includes a support member; and means for pressurizing a plurality of pressure chambers coupled to the support member. In an exemplary embodiment, the system further includes means for transmitting torsional loads.

A system for injecting a hardenable fluidic sealing material into an annulus between a tubular member and a preexisting structure has been described that includes means for positioning the tubular member into the preexisting structure; means for sealing off an end of the tubular member; means for operating a valve within the end of the tubular member; and means for injecting a hardenable fluidic sealing material through the valve into the annulus between the tubular member and the preexisting structure.

A method of engaging a tubular member has been described that includes positioning a plurality of elements within the tubular member; and bringing the elements into engagement with the tubular member. In an exemplary embodiment, the elements include a first group of elements; and a second group of elements; wherein the first group of elements are interleaved with the second group of elements. In an exemplary embodiment, bringing the elements into engagement with the tubular member includes bringing the elements into axial alignment. In an exemplary embodiment, bringing the elements into engagement with the tubular member further includes pivoting the elements. In an exemplary embodiment, bringing the elements into engagement with the tubular member further includes translating the elements. In an exemplary embodiment, bringing the elements into engagement with the tubular member further includes pivoting the elements; and translating the elements. In an exemplary embodiment, bringing the elements into engagement with the tubular member includes rotating the elements about a common axis. In an exemplary embodiment, bringing the elements into engagement with the tubular member includes pivoting the elements about corresponding axes; translating the elements; and rotating the elements about a common axis. In an exemplary embodiment, the method further includes preventing the elements from coming into engagement with the tubular member if the inside diameter of the tubular member is less than a predetermined value. In an exemplary embodiment, preventing the elements from coming into engagement with the tubular member if the inside diameter of the tubular member is less than a predetermined value includes sensing the inside diameter of the tubular member.

A system for engaging a tubular member has been described that includes means for positioning a plurality of elements within the tubular member; and means for bringing the elements into engagement with the tubular member. In an exemplary embodiment, the elements include a first group of elements; and a second group of elements; wherein the first group of elements are interleaved with the second group of elements. In an exemplary embodiment, means for bringing the elements into engagement with the tubular member includes means for bringing the elements into axial alignment. In an exemplary embodiment, means for bringing the elements into engagement with the tubular member further includes means for pivoting the elements. In an exemplary embodiment, means for bringing the elements into engagement with the tubular member further includes means for translating the elements. In an exemplary embodiment, means for bringing the elements into engagement with the tubular member further includes means for pivoting the elements; and means for translating the elements. In an exemplary embodiment, means for bringing the elements into engagement with the tubular member includes means for rotating the elements about a common axis. In an exemplary embodiment, means for bringing the elements into engagement with the tubular member includes means for pivoting the elements about corresponding axes; means for translating the elements; and means for rotating the elements about a common axis. In an exemplary embodiment, the system further includes means for preventing the elements from coming into engagement with the tubular member if the inside diameter of the tubular member is less than a predetermined value. In an exemplary embodiment, means for preventing the elements from coming into engagement with the tubular member if the inside diameter of the tubular member is less than a predetermined value includes means for sensing the inside diameter of the tubular member.

A locking device for locking a tubular member to a support member has been described that includes a plurality of circumferentially spaced apart locking elements coupled to the support member for engaging an interior surface of the tubular member; a plurality of spring elements coupled to the support member for biasing corresponding locking elements out of engagement with the interior surface of the tubular member; a releasable retaining element releasably coupled to the support member for releasably retaining the locking elements in engagement with the interior surface of the tubular member; an actuator coupled to the support member for controllably displacing the retaining element relative to the locking elements; and a sensor coupled to the support member for sensing an operating condition within the tubular member for controllably displacing the retaining element relative to the locking elements.

A method of locking a tubular member to a support member has been described that includes engaging the interior surface of the tubular member at a plurality of circumferentially spaced apart locations using one or more engagement members; and disengaging the engagement members from the interior surface of the tubular member if an operating condition within the tubular member exceeds a predetermined amount; wherein the engagement members are biased out of engagement with the tubular member.

A system for locking a tubular member to a support member has been described that includes means for engaging the interior surface of the tubular member at a plurality of circumferentially spaced apart locations using one or more engagement members; and means for disengaging the engagement members from the interior surface of the tubular member if an operating condition within the tubular member exceeds a predetermined amount; wherein the engagement members are biased out of engagement with the tubular member.

A method has been described that includes positioning a packer assembly comprising a sealing element within a tubular member; setting the sealing element against an interior surface of the tubular member; and preventing the application of an impact load against the interior surface of the tubular member during setting the sealing element against the interior surface of the tubular member. In an exemplary embodiment, setting the sealing element against the interior surface of the tubular member comprises applying a first force against the sealing element to move the sealing element relative to the tubular member; and applying a second force against the sealing element to set the sealing element against the interior surface of the tubular member. In an exemplary embodiment, preventing the application of an impact load against the interior surface of the tubular member during setting the sealing element against the interior surface of the tubular member comprises preventing further application of the first force against the sealing element. In an exemplary embodiment, the method comprises coupling a packer control device to the packer assembly. In an exemplary embodiment, the tubular member extends within a wellbore; and the method further comprises positioning the packer control device and the packer assembly outside of the tubular member and in the wellbore. In an exemplary embodiment, the method comprises radially expanding and plastically deforming at least a portion of the tubular member. In an exemplary embodiment, the method comprises moving the packer control device and the packer assembly so that the packer control device and the packer assembly extend within the at least a portion of the tubular member. In an exemplary embodiment, the packer assembly further comprises at least one other sealing element; and the method further comprises setting the at least one other sealing element against the interior surface of the tubular member. In an exemplary embodiment, the method comprises decoupling the packer control device from the packer assembly. In an exemplary embodiment, the method comprises testing the ability of at least one of the sealing element and the at least one other sealing element to maintain a pressure seal against the interior surface of the tubular member.

A system has been described that includes means for positioning a packer assembly comprising a sealing element within a tubular member; means for setting the sealing element against an interior surface of the tubular member; and means for preventing the application of an impact load against the interior surface of the tubular member during setting the sealing element against the interior surface of the tubular member. In an exemplary embodiment, the means for setting the sealing element against the interior surface of the tubular member comprises means for applying a first force against the sealing element to move the sealing element relative to the tubular member; and means for applying a second force against the sealing element to set the sealing element against the interior surface of the tubular member. In an exemplary embodiment, the means for preventing the application of an impact load against the interior surface of the tubular member during setting the sealing element against the interior surface of the tubular member comprises means for preventing further application of the first force against the sealing element. In an exemplary embodiment, the system comprises means for coupling a packer control device to the packer assembly. In an exemplary embodiment, the tubular member extends within a wellbore; and the system further comprises means for positioning the packer control device and the packer assembly outside of the tubular member and in the wellbore. In an exemplary embodiment, the system comprises means for radially expanding and plastically deforming at least a portion of the tubular member. In an exemplary embodiment, the system comprises means for moving the packer control device and the packer assembly so that the packer control device and the packer assembly extend within the at least a portion of the tubular member. In an exemplary embodiment, the packer assembly comprises at least one other sealing element; and the system further comprises means for setting the at least one other sealing element against the interior surface of the tubular member. In an exemplary embodiment, the system comprises means for decoupling the packer control device from the packer assembly. In an exemplary embodiment, the system comprises means for testing the ability of at least one of the sealing element and the at least one other sealing element to maintain a pressure seal against the interior surface of the tubular member.

A method has been described that includes positioning a packer assembly comprising a sealing element within a tubular member; applying a first force against the sealing element to move the sealing element relative to the tubular member; and applying a second force against the sealing element to set the sealing element against an interior surface of the tubular member. In an exemplary embodiment, the method comprises preventing further application of the first force against the sealing element. In an exemplary embodiment, the method comprises preventing further application of the first force against the sealing element. In an exemplary embodiment, preventing further application of the first force against the sealing element prevents the application of an impact load against the interior surface of the tubular member. In an exemplary embodiment, the method comprises coupling a packer control device to the packer assembly. In an exemplary embodiment, the tubular member extends within a wellbore; and the method further comprises positioning the packer control device and the packer assembly outside of the tubular member and in the wellbore. In an exemplary embodiment, the method comprises radially expanding and plastically deforming at least a portion of the tubular member. In an exemplary embodiment, the method comprises moving the packer control device and the packer assembly so that the packer control device and the packer assembly extend within the at least a portion of the tubular member. In an exemplary embodiment, the packer assembly further comprises at least one other sealing element; and the method further comprises setting the at least one other sealing element against the interior surface of the tubular member. In an exemplary embodiment, the method comprises decoupling the packer control device from the packer assembly. In an exemplary embodiment, the method comprises testing the ability of at least one of the sealing element and the at least one other sealing element to maintain a pressure seal against the interior surface of the tubular member.

A system has been described that includes means for positioning a packer assembly comprising a sealing element within a tubular member; means for applying a first force against the sealing element to move the sealing element relative to the tubular member; and means for applying a second force against the sealing element to set the sealing element against an interior surface of the tubular member. In an exemplary embodiment, the system comprises means for preventing further application of the first force against the sealing element. In an exemplary embodiment, preventing further application of the first force against the sealing element prevents the application of an impact load against the interior surface of the tubular member. In an exemplary embodiment, the system comprises means for coupling a packer control device to the packer assembly. In an exemplary embodiment, the tubular member extends within a wellbore; and the system comprises means for positioning the packer control device and the packer assembly outside of the tubular member and in the wellbore. In an exemplary embodiment, the system comprises means for radially expanding and plastically deforming at least a portion of the tubular member. In an exemplary embodiment, the system comprises means for moving the packer control device and the packer assembly so that the packer control device and the packer assembly extend within the at least a portion of the tubular member. In an exemplary embodiment, the packer assembly comprises at least one other sealing element; and the system comprises means for setting the at least one other sealing element against the interior surface of the tubular member. In an exemplary embodiment, the system comprises means for decoupling the packer control device from the packer assembly. In an exemplary embodiment, the system comprises means for testing the ability of at least one of the sealing element and the at least one other sealing element to maintain a pressure seal against the interior surface of the tubular member.

A method has been described that includes coupling a packer control device to a packer assembly comprising a sealing element; positioning the packer control device and the packer assembly within a tubular member that extends within a wellbore; radially expanding and plastically deforming at least a portion of the tubular member; setting the sealing element against an interior surface of the tubular member, wherein setting the sealing element against the interior surface of the tubular member comprises applying a first force against the sealing element to move the sealing element relative to the tubular member; and applying a second force against the sealing element to set the sealing element against the interior surface of the tubular member; and preventing the application of an impact load against the interior surface of the tubular member during setting the sealing element against the interior surface of the tubular member by preventing further application of the first force against the sealing element.

A system has been described that includes means for coupling a packer control device to a packer assembly comprising a sealing element; means for positioning the packer control device and the packer assembly within a tubular member that extends within a wellbore; means for radially expanding and plastically deforming at least a portion of the tubular member; means for setting the sealing element against an interior surface of the tubular member, wherein the means for setting the sealing element against the interior surface of the tubular member comprises means for applying a first force against the sealing element to move the sealing element relative to the tubular member; and means for applying a second force against the sealing element to set the sealing element against the interior surface of the tubular member; and means for preventing the application of an impact load against the interior surface of the tubular member during setting the sealing element against the interior surface of the tubular member by preventing further application of the first force against the sealing element.

A method has been described that includes coupling a packer control device to a packer assembly comprising a sealing element and at least one other sealing element; positioning the packer control device and the packer assembly within a tubular member that extends within a wellbore; positioning the packer control device and the packer assembly outside of the tubular member and in the wellbore; radially expanding and plastically deforming at least a portion of the tubular member; moving the packer control device and the packer assembly so that the packer control device and the packer assembly extend within the at least a portion of the tubular member; setting the sealing element against an interior surface of the tubular member, wherein setting the sealing element against the interior surface of the tubular member comprises applying a first force against the sealing element to move the sealing element relative to the tubular member; and applying a second force against the sealing element to set the sealing element against the interior surface of the tubular member; preventing the application of an impact load against the interior surface of the tubular member during setting the sealing element against the interior surface of the tubular member by preventing further application of the first force against the sealing element; setting the at least one other sealing element against the interior surface of the tubular member; decoupling the packer control device from the packer assembly; and testing the ability of at least one of the sealing element and the at least one other sealing element to maintain a pressure seal against the interior surface of the tubular member.

A system has been described that includes means for coupling a packer control device to a packer assembly comprising a sealing element and at least one other sealing element; means for positioning the packer control device and the packer assembly within a tubular member that extends within a well bore; means for positioning the packer control device and the packer outside of the tubular member and in the wellbore; means for radially expanding and plastically deforming at least a portion of the tubular member; means for moving the packer control device and the packer assembly so that the packer control device and the packer assembly extend within the at least a portion of the tubular member; means for setting the sealing element against an interior surface of the tubular member, wherein the means for setting the sealing element against the interior surface of the tubular member comprises means for applying a first force against the sealing element to move the sealing element relative to the tubular member; and means for applying a second force against the sealing element to set the sealing element against the interior surface of the tubular member; means for preventing the application of an impact load against the interior surface of the tubular member during setting the sealing element against the interior surface of the tubular member by preventing further application of the first force against the sealing element; means for setting the at least one other sealing element against the interior surface of the tubular member; means for decoupling the packer control device from the packer assembly; and means for testing the ability of at least one of the sealing element and the at least one other sealing element to maintain a pressure seal against the interior surface of the tubular member.

An apparatus for controlling the operation of a packer assembly has been described that includes a first tubular support; a second tubular support at least partially extending within the first tubular support; one or more first retaining dogs coupled to the first tubular support for releasably engaging the second tubular support; and a stinger coupled to the second tubular support for releasably engaging the packer assembly. In an exemplary embodiment, the one or more first retaining dogs and the first tubular support are movable relative to the second tubular support when the one or more first retaining dogs are released from the second tubular support. In an exemplary embodiment, the apparatus comprises one or more second retaining dogs releasably engaged with the first tubular support. In an exemplary embodiment, the one or more first retaining dogs and the first tubular support are movable relative to the second tubular support when the one or more first retaining dogs are released from the second tubular support and the one or more second retaining dogs are released from the first tubular support. In an exemplary embodiment, the apparatus comprises a third tubular support coupled to the second tubular support and the stinger. In an exemplary embodiment, the apparatus comprises a compressible element at least partially circumferentially extending about the third tubular support. In an exemplary embodiment, the compressible element comprises a first configuration in which the compressible element is uncompressed; and a second configuration in which the compressible element is at least partially compressed. In an exemplary embodiment, when the one or more first retaining dogs are released from the second tubular support, the one or more first retaining dogs and the first tubular support are movable relative to the second tubular support to place the compressible element in the second configuration. In an exemplary embodiment, when the compressible element is in the second configuration, the first tubular support is movable in a direction relative to the second tubular support to cause a first force to be applied against at least one sealing element of the packer assembly. In an exemplary embodiment, the third tubular support comprises an external flange for preventing further movement of the first tubular support in the direction when the compressible element is in the second configuration. In an exemplary embodiment, the compressible element further comprises a third configuration in which the compressible element is permitted to uncompress to cause a second force to be applied against the at least one sealing element of the packer assembly. In an exemplary embodiment, the at least one sealing element is adapted to be set against an interior surface of a tubular member in response to the second force applied against the at least one sealing element. In an exemplary embodiment, the compressible element comprises a spring. In an exemplary embodiment, the apparatus comprises a fourth tubular support coupled to the third tubular support and through which the third tubular support extends, the fourth tubular support comprising an external flange and engaging the external flange of the third tubular support; a spring mandrel coupled to the first tubular support and through which the fourth tubular support extends, the spring mandrel at least partially defining an annular region in which the spring extends; and a spring sleeve at least partially circumferentially extending about the spring for retaining the spring within the annular region; wherein the spring mandrel is movable in the direction relative to the spring sleeve to place the spring in the second configuration. In an exemplary embodiment, the spring mandrel is adapted to engage the external flange of the fourth tubular support when the spring is in the second configuration; and movement of the first tubular support and the spring mandrel in the direction is prevented in response to the engagement of the spring mandrel with the external flange of the fourth tubular support and the engagement of the fourth tubular support with the external flange of the third tubular support. In an exemplary embodiment, the spring mandrel comprises an internal annular recess and the fourth tubular support comprises an external annular recess; and the apparatus further comprises a locking dog received within the internal annular recess of the spring mandrel, the locking dog comprising a first configuration in which the locking dog engages an exterior surface of the fourth tubular support; and a second configuration in which the locking dog is received within the external annular recess of the fourth tubular support to limit movement of the spring mandrel relative to the fourth tubular support. In an exemplary embodiment, the apparatus comprises one or more rupture discs coupled to the third tubular support; wherein an exterior surface of the third tubular support and an interior surface of the first tubular support define an annular region; wherein, when the one or more rupture discs rupture, fluidic material is permitted to flow into the annular region; and wherein the one or more second retaining dogs are released from the first tubular support in response to the flow of the fluidic material into the annular region. In an exemplary embodiment, the apparatus comprises the packer assembly. In an exemplary embodiment, the apparatus comprises a tubular member within which the packer assembly at least partially extends. In an exemplary embodiment, the packer assembly comprises a support member defining a passage; a shoe comprising a float valve coupled to an end of the support member; one or more sealing elements movably coupled to the support member; and a sliding sleeve valve positioned within the passage of the support member; wherein the stinger engages the sliding sleeve valve.

An apparatus for controlling the operation of a packer assembly has been described that includes a first tubular support; a second tubular support at least partially extending within the first tubular support; one or more first retaining dogs coupled to the first tubular support for releasably engaging the second tubular support; a stinger coupled to the second tubular support for releasably engaging the packer assembly; and one or more second retaining dogs releasably engaged with the first tubular support; wherein the one or more first retaining dogs and the first tubular support are movable relative to the second tubular support when the one or more first retaining dogs are released from the second tubular support and the one or more second retaining dogs are released from the first tubular support.

An apparatus for controlling the operation of a packer assembly has been described that includes a first tubular support; a second tubular support at least partially extending within the first tubular support; one or more first retaining dogs coupled to the first tubular support for releasably engaging the second tubular support; a stinger coupled to the second tubular support for releasably engaging the packer assembly; one or more second retaining dogs releasably engaged with the first tubular support, wherein the one or more first retaining dogs and the first tubular support are movable relative to the second tubular support when the one or more first retaining dogs are released from the second tubular support and the one or more second retaining dogs are released from the first tubular support; a third tubular support coupled to the second tubular support and the stinger; a compressible element at least partially circumferentially extending about the third tubular support, wherein the compressible element comprises a first configuration in which the compressible element is uncompressed; a second configuration in which the compressible element is at least partially compressed; wherein, when the one or more first retaining dogs are released from the second tubular support and the one or more second retaining dogs are released from the first tubular support, the one or more first retaining dogs and the first tubular support are movable relative to the second tubular support to place the compressible element in the second configuration; wherein, when the compressible element is in the second configuration, the first tubular support is movable in a direction relative to the second tubular support to cause a first force to be applied against at least one sealing element of the packer assembly; wherein the third tubular support comprises an external flange for preventing further movement of the first tubular support in the direction when the compressible element is in the second configuration; wherein the compressible element further comprises a third configuration in which the compressible element is permitted to uncompress to cause a second force to be applied against the at least one sealing element of the packer assembly; and wherein the at least one sealing element is adapted to be set against an interior surface of a tubular member in response to the second force applied against the at least one sealing element. In an exemplary embodiment, the compressible element comprises a spring. In an exemplary embodiment, the apparatus comprises a fourth tubular support coupled to the third tubular support and through which the third tubular support extends, the fourth tubular support comprising an external flange and engaging the external flange of the third tubular support; a spring mandrel coupled to the first tubular support and through which the fourth tubular support extends, the spring mandrel at least partially defining an annular region in which the spring extends; and a spring sleeve at least partially circumferentially extending about the spring for retaining the spring within the annular region; wherein the spring mandrel is movable in the direction relative to the spring sleeve to place the spring in the second configuration. In an exemplary embodiment, the spring mandrel is adapted to engage the external flange of the fourth tubular support when the spring is in the second configuration; and movement of the first tubular support and the spring mandrel in the direction is prevented in response to the engagement of the spring mandrel with the external flange of the fourth tubular support and the engagement of the fourth tubular support with the external flange of the third tubular support. In an exemplary embodiment, the spring mandrel comprises an internal annular recess and the fourth tubular support comprises an external annular recess; and the apparatus further comprises a locking dog received within the internal annular recess of the spring mandrel, the locking dog comprising a first configuration in which the locking dog engages an exterior surface of the fourth tubular support; and a second configuration in which the locking dog is received within the external annular recess of the fourth tubular support to limit movement of the spring mandrel relative to the fourth tubular support. In an exemplary embodiment, the apparatus comprises one or more rupture discs coupled to the third tubular support; wherein an exterior surface of the third tubular support and the interior surface of the first tubular support define an annular region; wherein, when the one or more rupture discs rupture, fluidic material is permitted to flow into the annular region; and wherein the one or more second retaining dogs are released from the first tubular support in response to the flow of the fluidic material into the annular region. In an exemplary embodiment, the apparatus comprises the packer assembly. In an exemplary embodiment, the apparatus comprises a tubular member within which the packer assembly at least partially extends. In an exemplary embodiment, the packer assembly comprises a support member to which the at least one sealing element is movably coupled, the support member defining a passage; and a shoe comprising a float valve coupled to an end of the support member. In an exemplary embodiment, the packer assembly further comprises a sliding sleeve valve positioned within the passage of the support member; wherein the stinger engages the sliding sleeve valve.

An apparatus for controlling the operation of a packer assembly has been described that includes a first tubular support; a second tubular support at least partially extending within the first tubular support; one or more first retaining dogs coupled to the first tubular support for releasably engaging the second tubular support; a stinger coupled to the second tubular support for releasably engaging the packer assembly; one or more second retaining dogs releasably engaged with the first tubular support, wherein the one or more first retaining dogs and the first tubular support are movable relative to the second tubular support when the one or more first retaining dogs are released from the second tubular support and the one or more second retaining dogs are released from the first tubular support; a third tubular support coupled to the second tubular support and the stinger; a compressible element at least partially circumferentially extending about the third tubular support, wherein the compressible element comprises a first configuration in which the compressible element is uncompressed; and a second configuration in which the compressible element is at least partially compressed; wherein, when the one or more first retaining dogs are released from the second tubular support and the one or more second retaining dogs are released from the first tubular support, the one or more first retaining dogs and the first tubular support are movable relative to the second tubular support to place the compressible element in the second configuration; wherein, when the compressible element is in the second configuration, the first tubular support is movable in a direction relative to the second tubular support to cause a first force to be applied against at least one sealing element of the packer assembly; wherein the third tubular support comprises an external flange for preventing further movement of the first tubular support in the direction when the compressible element is in the second configuration; wherein the compressible element further comprises a third configuration in which the compressible element is permitted to uncompress to cause a second force to be applied against the at least one sealing element of the packer assembly; and wherein the at least one sealing element is adapted to be set against an interior surface of a tubular member in response to the second force applied against the at least one sealing element; wherein the compressible element comprises a spring; wherein the apparatus further comprises a fourth tubular support coupled to the third tubular support and through which the third tubular support extends, the fourth tubular support comprising an external flange and engaging the external flange of the third tubular support; a spring mandrel coupled to the first tubular support and through which the fourth tubular support extends, the spring mandrel at least partially defining a first annular region in which the spring extends; and a spring sleeve at least partially circumferentially extending about the spring for retaining the spring within the first annular region; wherein the spring mandrel is movable in the direction relative to the spring sleeve to place the spring in the second configuration; wherein the spring mandrel is adapted to engage the external flange of the fourth tubular support when the spring is in the second configuration; and wherein movement of the first tubular support and the spring mandrel in the direction is prevented in response to the engagement of the spring mandrel with the external flange of the fourth tubular support and the engagement of the fourth tubular support with the external flange of the third tubular support; wherein the spring mandrel comprises an internal annular recess and the fourth tubular support comprises an external annular recess; wherein the apparatus further comprises a locking dog received within the internal annular recess of the spring mandrel, the locking dog comprising a first configuration in which the locking dog engages an s of the fourth tubular support; and a second configuration in which the locking dog is received within the external annular recess of the fourth tubular support to limit movement of the spring mandrel relative to the fourth tubular support; one or more rupture discs coupled to the third tubular support; and the packer assembly; wherein an exterior surface of the third tubular support and the interior surface of the first tubular support define a second annular region; wherein, when the one or more rupture discs rupture, fluidic material is permitted to flow into the second annular region; wherein the one or more second retaining dogs are released from the first tubular support in response to the flow of the fluidic material into the second annular region; and wherein the packer assembly comprises a support member to which the at least one sealing element is movably coupled, the support member defining a passage; a shoe comprising a float valve coupled to an end of the support member; and a sliding sleeve valve positioned within the passage of the support member; wherein the stinger engages the sliding sleeve valve.

An apparatus for controlling the operation of a packer assembly has been described that includes a first tubular support; a stinger coupled to the first tubular support for releasably engaging the packer assembly; and a compressible element at least partially circumferentially extending about the first tubular support; wherein the compressible element comprises a first configuration in which the compressible element is uncompressed; and a second configuration in which the compressible element is at least partially compressed. In an exemplary embodiment, the apparatus comprises a second tubular support coupled to the first tubular support and within which the first tubular support at least partially extends; and a third tubular support within which the second tubular support at least partially extends; wherein, when the compressible element is in the second configuration, the third tubular support is movable in a direction relative to the second tubular support to cause a first force to be applied against at least one sealing element of the packer assembly. In an exemplary embodiment, the first tubular support comprises an external flange for preventing further movement of the third tubular support in the direction when the compressible element is in the second configuration. In an exemplary embodiment, the compressible element further comprises a third configuration in which the compressible element is permitted to uncompress to cause a second force to be applied against the at least one sealing element of the packer assembly. In an exemplary embodiment, the at least one sealing element is adapted to be set against an interior surface of a tubular member in response to the second force applied against the at least one sealing element. In an exemplary embodiment, the apparatus comprises one or more first retaining dogs coupled to the third tubular support for releasably engaging the second tubular support. In an exemplary embodiment, the one or more first retaining dogs and the third tubular support are movable relative to the second tubular support when the one or more first retaining dogs are released from the second tubular support. In an exemplary embodiment, the apparatus comprises one or more second retaining dogs releasably engaged with the third tubular support. In an exemplary embodiment, the one or more first retaining dogs and the third tubular support are movable relative to the second tubular support when the one or more first retaining dogs are released from the second tubular support and the one or more second retaining dogs are released from the third tubular support. In an exemplary embodiment, the compressible element comprises a spring. In an exemplary embodiment, the apparatus comprises a fourth tubular support coupled to the first tubular support and through which the first tubular support extends, the fourth tubular support comprising an external flange and engaging the external flange of the first tubular support; a spring mandrel coupled to the third tubular support and through which the fourth tubular support extends, the spring mandrel at least partially defining an annular region in which the spring extends; and a spring sleeve at least partially circumferentially extending about the spring for retaining the spring within the annular region; wherein the spring mandrel is movable in the direction relative to the spring sleeve to place the spring in the second configuration. In an exemplary embodiment, the spring mandrel is adapted to engage the external flange of the fourth tubular support when the spring is in the second configuration; and movement of the third tubular support and the spring mandrel in the direction is prevented in response to the engagement of the spring mandrel with the external flange of the fourth tubular support and the engagement of the fourth tubular support with the external flange of the first tubular support. In an exemplary embodiment, the spring mandrel comprises an internal annular recess and the fourth tubular support comprises an external annular recess; and the apparatus comprises a locking dog received within the internal annular recess of the spring mandrel, the locking dog comprising a first configuration in which the locking dog engages an exterior surface of the fourth tubular support; and a second configuration in which the locking dog is received within the external annular recess of the fourth tubular support to limit movement of the spring mandrel relative to the fourth tubular support. In an exemplary embodiment, the apparatus comprises one or more rupture discs coupled to the first tubular support; wherein an exterior surface of the first tubular support and an interior surface of the third tubular support define an annular region; wherein, when the one or more rupture discs rupture, fluidic material is permitted to flow into the annular region; and wherein the one or more second retaining dogs are released from the third tubular support in response to the flow of the fluidic material into the annular region. In an exemplary embodiment, the apparatus comprises the packer assembly. In an exemplary embodiment, the apparatus comprises a tubular member within which the packer assembly at least partially extends. In an exemplary embodiment, the packer assembly comprises a support member defining a passage; a shoe comprising a float valve coupled to an end of the support member; one or more sealing elements movably coupled to the support member; and a sliding sleeve valve positioned within the passage of the support member; wherein the stinger engages the sliding sleeve valve.

An apparatus for controlling the operation of a packer assembly has been described that includes a first tubular support; a stinger coupled to the first tubular support for releasably engaging the packer assembly; a compressible element at least partially circumferentially extending about the first tubular support, wherein the compressible element comprises a first configuration in which the compressible element is uncompressed; and a second configuration in which the compressible element is at least partially compressed; a second tubular support coupled to the first tubular support and within which the first tubular support at least partially extends; and a third tubular support within which the second tubular support at least partially extends; wherein, when the compressible element is in the second configuration, the third tubular support is movable in a direction relative to the second tubular support to cause a first force to be applied against at least one sealing element of the packer assembly; wherein the first tubular support comprises an external flange for preventing further movement of the third tubular support in the direction when the compressible element is in the second configuration; wherein the compressible element further comprises a third configuration in which the compressible element is permitted to uncompress to cause a second force to be applied against the at least one sealing element of the packer assembly; wherein the at least one sealing element is adapted to be set against an interior surface of a tubular member in response to the second force applied against the at least one sealing element.

An apparatus for controlling the operation of a packer assembly has been described that includes a first tubular support; a stinger coupled to the first tubular support for releasably engaging the packer assembly; a compressible element at least partially circumferentially extending about the first tubular support, wherein the compressible element comprises a first configuration in which the compressible element is uncompressed; and a second configuration in which the compressible element is at least partially compressed; a second tubular support coupled to the first tubular support and within which the first tubular support at least partially extends; and a third tubular support within which the second tubular support at least partially extends; wherein, when the compressible element is in the second configuration, the third tubular support is movable in a direction relative to the second tubular support to cause a first force to be applied against at least one sealing element of the packer assembly; wherein the first tubular support comprises an external flange for preventing further movement of the third tubular support in the direction when the compressible element is in the second configuration; wherein the compressible element further comprises a third configuration in which the compressible element is permitted to uncompress to cause a second force to be applied against the at least one sealing element of the packer assembly; wherein the at least one sealing element is adapted to be set against an interior surface of a tubular member in response to the second force applied against the at least one sealing element; and wherein the apparatus further comprises one or more first retaining dogs coupled to the third tubular support for releasably engaging the second tubular support; and one or more second retaining dogs releasably engaged with the third tubular support; wherein the one or more first retaining dogs and the third tubular support are movable relative to the second tubular support when the one or more first retaining dogs are released from the second tubular support and the one or more second retaining dogs are released from the third tubular support. In an exemplary embodiment, the compressible element comprises a spring. In an exemplary embodiment, the apparatus comprises a fourth tubular support coupled to the first tubular support and through which the first tubular support extends, the fourth tubular support comprising an external flange and engaging the external flange of the first tubular support; a spring mandrel coupled to the third tubular support and through which the fourth tubular support extends, the spring mandrel at least partially defining an annular region in which the spring extends; and a spring sleeve at least partially circumferentially extending about the spring for retaining the spring within the annular region; wherein the spring mandrel is movable in the direction relative to the spring sleeve to place the spring in the second configuration. In an exemplary embodiment, the spring mandrel is adapted to engage the external flange of the fourth tubular support when the spring is in the second configuration; and movement of the third tubular support and the spring mandrel in the direction is prevented in response to the engagement of the spring mandrel with the external flange of the fourth tubular support and the engagement of the fourth tubular support with the external flange of the first tubular support. In an exemplary embodiment, the spring mandrel comprises an internal annular recess and the fourth tubular support comprises an external annular recess; and the apparatus further comprises a locking dog received within the internal annular recess of the spring mandrel, the locking dog comprising a first configuration in which the locking dog engages an exterior surface of the fourth tubular support; and a second configuration in which the locking dog is received within the external annular recess of the fourth tubular support to limit movement of the spring mandrel relative to the fourth tubular support. In an exemplary embodiment, the apparatus comprises one or more rupture discs coupled to the first tubular support; wherein an exterior surface of the first tubular support and an interior surface of the third tubular support define an annular region; wherein, when the one or more rupture discs rupture, fluidic material is permitted to flow into the annular region; and wherein the one or more second retaining dogs are released from the third tubular support in response to the flow of the fluidic material into the annular region. In an exemplary embodiment, the apparatus comprises the packer assembly. In an exemplary embodiment, the apparatus comprises a tubular member within which the packer assembly at least partially extends. In an exemplary embodiment, the packer assembly comprises a support member to which the at least one sealing element is movably coupled, the support member defining a passage; a shoe comprising a float valve coupled to an end of the support member; and a sliding sleeve valve positioned within the passage of the support member; wherein the stinger engages the sliding sleeve valve.

An apparatus has been described that includes a packer control device for controlling the operation of a packer, the packer control device comprising a first support member; one or more drag blocks releasably coupled to the support member; and a stinger coupled to the first support member for engaging the packer. In an exemplary embodiment, the apparatus comprises the packer comprising a second support member defining a passage; a shoe comprising a float valve coupled to an end of the second support member; one or more compressible packer elements movably coupled to the second support member; and a sliding sleeve valve positioned within the passage of the second support member; wherein the stinger engages the sliding sleeve valve.

An apparatus has been described that includes a packer control device for controlling the operation of a packer, the packer control device comprising a first support member; one or more drag blocks releasably coupled to the support member; and a stinger coupled to the first support member for engaging the packer; and the packer comprising a second support member defining a passage; a shoe comprising a float valve coupled to an end of the second support member; one or more compressible packer elements movably coupled to the second support member; and a sliding sleeve valve positioned within the passage of the second support member; wherein the stinger engages the sliding sleeve valve.

A method has been described that includes positioning an actuator assembly in a tubular member, the actuator assembly comprising one or more adjustable annular regions; placing the actuator assembly in a first configuration; and placing the actuator assembly in a second configuration, comprising pressurizing the one or more adjustable annular regions. In an exemplary embodiment, the method comprises radially expanding and plastically deforming at least a portion of the tubular member during placing the actuator assembly in the second configuration. In an exemplary embodiment, the method comprises coupling the actuator assembly to an expansion device. In an exemplary embodiment, the method comprises displacing the expansion device to radially expand and plastically deform at least a portion of the tubular member during placing the actuator assembly in the second configuration. In an exemplary embodiment, pressurizing the one or more adjustable annular regions comprises fluidicly pressurizing the one or more adjustable annular regions. In an exemplary embodiment, the actuator assembly comprises one or more first tubular supports; and one or more second tubular supports at least partially extending within the one or more first tubular supports; wherein the one or more adjustable annular regions are at least partially defined between the one or more first tubular supports and the one or more second tubular supports. In an exemplary embodiment, placing the actuator assembly in the second configuration comprises displacing the one or more second tubular supports relative to the one or more first tubular supports in response to pressurizing the one or more adjustable annular regions. In an exemplary embodiment, pressurizing the one or more adjustable annular regions comprises fluidicly pressurizing the one or more adjustable annular regions. In an exemplary embodiment, fluidicly pressurizing the one or more adjustable annular regions comprises introducing fluidic material into one or more passages defined by the one or more second tubular supports; and permitting the fluidic material to flow from the one or more passages and into the one or more adjustable annular regions. In an exemplary embodiment, fluidicly pressurizing the one or more adjustable annular regions further comprises sealingly engaging an outside surface of each of the one or more second tubular supports with one or more first sealing elements; and sealingly engaging an inside surface of each of the one or more first tubular supports with one or more second sealing elements. In an exemplary embodiment, each of the one or more first sealing elements and the one or second sealing elements comprises a cup. In an exemplary embodiment, the actuator assembly comprises at least five adjustable annular regions. In an exemplary embodiment, the method comprises transmitting torque through the actuator assembly. In an exemplary embodiment, the method comprises transmitting torque through the actuator assembly in the first configuration. In an exemplary embodiment, the method comprises transmitting torque through the actuator assembly in the second configuration. In an exemplary embodiment, the method comprises transmitting torque through the actuator assembly in the first configuration; and transmitting torque through the actuator assembly in the second configuration. In an exemplary embodiment, the method comprises coupling a gripping device to the actuator assembly. In an exemplary embodiment, placing the actuator assembly in the second configuration comprises gripping the tubular member using the gripping device.

A method has been described that includes positioning an actuator assembly in a tubular member, the actuator assembly comprising one or more first tubular supports; one or more second tubular supports at least partially extending within the one or more first tubular supports; and one or more adjustable annular regions at least partially defined between the one or more first tubular supports and the one or more second tubular supports; placing the actuator assembly in a first configuration; and placing the actuator assembly in a second configuration, comprising fluidicly pressurizing the one or more adjustable annular regions, comprising sealingly engaging an outside surface of each of the one or more second tubular supports with one or more first sealing elements; sealingly engaging an inside surface of each of the one or more first tubular supports with one or more second sealing elements; introducing fluidic material into one or more passages defined by the one or more second tubular supports; and permitting the fluidic material to flow from the one or more passages and into the one or more adjustable annular regions; and displacing the one or more second tubular supports relative to the one or more first tubular supports in response to fluidicly pressurizing the one or more adjustable annular regions; coupling the actuator assembly to an expansion device; radially expanding and plastically deforming at least a portion of the tubular member during placing the actuator assembly in the second configuration, comprising displacing the expansion device to radially expand and plastically deform the at least a portion of the tubular member during placing the actuator assembly in the second configuration; permitting torque to be transmitted through the actuator assembly in the first configuration; permitting torque to be transmitted through the actuator assembly in the second configuration; and coupling a gripping device to the actuator assembly; wherein placing the actuator assembly in the second configuration comprises gripping the tubular member using the gripping device.

A system has been described that includes means for positioning an actuator assembly in a tubular member, the actuator assembly comprising one or more adjustable annular regions; means for placing the actuator assembly in a first configuration; and means for placing the actuator assembly in a second configuration, comprising means for pressurizing the one or more adjustable annular regions. In an exemplary embodiment, the system comprises means for radially expanding and plastically deforming at least a portion of the tubular member during placing the actuator assembly in the second configuration. In an exemplary embodiment, the system comprises means for coupling the actuator assembly to an expansion device. In an exemplary embodiment, the system comprises means for displacing the expansion device to radially expand and plastically deform at least a portion of the tubular member during placing the actuator assembly in the second configuration. In an exemplary embodiment, means for pressurizing the one or more adjustable annular regions comprises means for fluidicly pressurizing the one or more adjustable annular regions. In an exemplary embodiment, the actuator assembly comprises one or more first tubular supports; and one or more second tubular supports at least partially extending within the one or more first tubular supports; wherein the one or more adjustable annular regions are at least partially defined between the one or more first tubular supports and the one or more second tubular supports. In an exemplary embodiment, the system comprises means for placing the actuator assembly in the second configuration comprises means for displacing the one or more second tubular supports relative to the one or more first tubular supports in response to pressurizing the one or more adjustable annular regions. In an exemplary embodiment, means for pressurizing the one or more adjustable annular regions comprises fluidicly pressurizing the one or more adjustable annular regions. In an exemplary embodiment, means for fluidicly pressurizing the one or more adjustable annular regions comprises means for introducing fluidic material into one or more passages defined by the one or more second tubular supports; and means for permitting the fluidic material to flow from the one or more passages and into the one or more adjustable annular regions. In an exemplary embodiment, means for fluidicly pressurizing the one or more adjustable annular regions further comprises means for sealingly engaging an outside surface of each of the one or more second tubular supports with one or more first sealing elements; and means for sealingly engaging an inside surface of each of the one or more first tubular supports with one or more second sealing elements. In an exemplary embodiment, each of the one or more first sealing elements and the one or second sealing elements comprises a cup. In an exemplary embodiment, the actuator assembly comprises at least five adjustable annular regions. In an exemplary embodiment, the system comprises means for transmitting torque through the actuator assembly. In an exemplary embodiment, the system comprises means for transmitting torque through the actuator assembly in the first configuration. In an exemplary embodiment, the system comprises means for transmitting torque through the actuator assembly in the second configuration. In an exemplary embodiment, the system comprises transmitting torque through the actuator assembly in the first configuration; and transmitting torque through the actuator assembly in the second configuration. In an exemplary embodiment, the system comprises means for coupling a gripping device to the actuator assembly. In an exemplary embodiment, means for placing the actuator assembly in the second configuration comprises means for gripping the tubular member using the gripping device.

A system has been described that includes means for positioning an actuator assembly in a tubular member, the actuator assembly comprising one or more first tubular supports; one or more second tubular supports at least partially extending within the one or more first tubular supports; and one or more adjustable annular regions at least partially defined between the one or more first tubular supports and the one or more second tubular supports; means for placing the actuator assembly in a first configuration; and means for placing the actuator assembly in a second configuration, comprising means for fluidicly pressurizing the one or more adjustable annular regions, comprising means for sealingly engaging an outside surface of each of the one or more second tubular supports with one or more first sealing elements; means for sealingly engaging an inside surface of each of the one or more first tubular supports with one or more second sealing elements; means for introducing fluidic material into one or more passages defined by the one or more second tubular supports; and means for permitting the fluidic material to flow from the one or more passages and into the one or more adjustable annular regions; and means for displacing the one or more second tubular supports relative to the one or more first tubular supports in response to fluidicly pressurizing the one or more adjustable annular regions; means for coupling the actuator assembly to an expansion device; means for radially expanding and plastically deforming at least a portion of the tubular member during placing the actuator assembly in the second configuration, comprising means for displacing the expansion device to radially expand and plastically deform the at least a portion of the tubular member during placing the actuator assembly in the second configuration; means for permitting torque to be transmitted through the actuator assembly in the first configuration; means for permitting torque to be transmitted through the actuator assembly in the second configuration; and means for coupling a gripping device to the actuator assembly; wherein means for placing the actuator assembly in the second configuration comprises means for gripping the tubular member using the gripping device.

An apparatus has been described that includes an actuator assembly comprising at least one first tubular support; at least one second tubular support at least partially extending within the at least one first tubular support, the at least one second tubular support is movable between a first position and a second position; and at least one adjustable annular region at least partially defined between the at least one first tubular support and the at least one second tubular support and adapted to be pressurized; wherein the at least one second tubular support is placed in the second position from the first position in response to the pressurization of the at least one adjustable annular region. In an exemplary embodiment, the actuator assembly further comprises at least one first sealing element sealingly engaging the outside surface of the at least one second tubular support; and at least one second sealing element coupled to the at least one second tubular support and sealingly engaging the inside surface of the at least one first tubular support. In an exemplary embodiment, at least one adjustable annular region is at least partially defined by the at least one second sealing element. In an exemplary embodiment, at least one second sealing element is movable between a first position and a second position to adjust the size of the at least one adjustable annular region; and wherein the at least one first sealing element remains stationary during the movement of the at least one second sealing element between the first and second positions. In an exemplary embodiment, each of the at least one first sealing element and the at least one second sealing element comprises a cup. In an exemplary embodiment, a passage is defined by the at least one second tubular support. In an exemplary embodiment, at least one second tubular support comprises at least one radial opening via which the passage defined by the at least one second tubular support is in fluid communication with the at least one adjustable annular region. In an exemplary embodiment, the actuator assembly further comprises one or more torque lugs for transmitting torque through the actuator assembly. In an exemplary embodiment, the actuator assembly further comprises one or more first torque lugs for transmitting torque through the actuator assembly when the at least one second tubular support is in the first position; and one or more second torque lugs for transmitting torque through the actuator assembly when the at least one second tubular support is in the second position. In an exemplary embodiment, the apparatus comprises an expansion device coupled to the actuator assembly; wherein the expansion device moves in response to the movement of the at least one second tubular support between the first and second positions. In an exemplary embodiment, the apparatus comprises a gripping device coupled to the actuator assembly. In an exemplary embodiment, the actuator assembly comprises a plurality of first tubular supports, each first tubular support in the plurality of first tubular supports is coupled to at least one other first tubular support in the plurality of first tubular supports; and a plurality of second tubular supports, each second tubular support in the plurality of second tubular supports at least partially extends within at least one first tubular support in the plurality of first tubular supports. In an exemplary embodiment, the actuator assembly comprises a plurality of adjustable annular regions; wherein each adjustable annular region in the plurality of adjustable annular regions is at least partially defined between one first tubular support in the plurality of first tubular supports and one second tubular support in the plurality of second tubular supports. In an exemplary embodiment, the plurality of adjustable annular regions comprises at least five adjustable annular regions.

An apparatus has been described that includes an actuator assembly comprising at least one first tubular support; at least one second tubular support at least partially extending within the at least one first tubular support, the at least one second tubular support is movable between a first position and a second position; at least one first sealing element sealingly engaging the outside surface of the at least one second tubular support; at least one second sealing element coupled to the at least one second tubular support and sealingly engaging the inside surface of the at least one first tubular support; at least one adjustable annular region at least partially defined between the at least one first tubular support and the at least one second tubular support and adapted to be pressurized; wherein the at least one second tubular support is placed in the second position from the first position in response to the pressurization of the at least one adjustable annular region; wherein the at least one adjustable annular region is at least partially defined by the at least one second sealing element; wherein the at least one second sealing element is movable between a first position and a second position to adjust the size of the at least one adjustable annular region; wherein the at least one first sealing element remains stationary during the movement of the at least one second sealing element between the first and second positions; wherein each of the at least one first sealing element and the at least one second sealing element comprises a cup; wherein a passage is defined by the at least one second tubular support; wherein the at least one second tubular support comprises at least one radial opening via which the passage defined by the at least one second tubular support is in fluid communication with the at least one adjustable annular region; and wherein the actuator assembly further comprises one or more first torque lugs for transmitting torque through the actuator assembly when the at least one second tubular support is in the first position; and one or more second torque lugs for transmitting torque through the actuator assembly when the at least one second tubular support is in the second position; and wherein the apparatus further comprises an expansion device coupled to the actuator assembly, the expansion device moves in response to the movement of the at least one second tubular support between the first and second positions; and a gripping device coupled to the actuator assembly.

A device has been described that is adapted to be coupled to a first tubular support within which a second tubular support at least partially extends, the device comprising a body member; an opening in the body member within which the second tubular support is adapted to at least partially extend when the device is coupled to the first tubular support; and an internal recess in the body member within which the first tubular support is adapted to at least partially extend when the device is coupled to the first tubular support. In an exemplary embodiment, the internal recess defines an internal shoulder with which the first tubular support is adjacent when the device is coupled to the first tubular support and the first tubular support at least partially extends within the internal recess. In an exemplary embodiment, movement of the first tubular support, in an axial direction and relative to the second tubular support, is generally prevented when the device is coupled to the first tubular support and the first tubular support at least partially extends within the internal recess. In an exemplary embodiment, the body member defines an end surface with which at least a portion of the second tubular support is adjacent when the second tubular support at least partially extends within the opening. In an exemplary embodiment, movement of the second tubular support, in another axial direction and relative to the first tubular support, is generally prevented when the device is coupled to the first tubular support, the first tubular support at least partially extends within the internal recess and the second tubular support at least partially extends within the opening. In an exemplary embodiment, the device comprises first and second bores formed through the body member; and first and second fasteners extending through the first and second bores, respectively, and into the internal recess. In an exemplary embodiment, the first and second fasteners are adapted to further extend into first and second radial openings, respectively, in the first tubular support when the device is coupled to the first tubular support and the first tubular support at least partially extends within the internal recess. In an exemplary embodiment, the opening defines a first internal arcuate surface of the body member and first and second parallel-spaced surfaces of the body member extending from the first internal arcuate surface of the body member. In an exemplary embodiment, the internal recess defines a second internal arcuate surface of the body member and third and fourth parallel-spaced surfaces of the body member extending from the second internal arcuate surface of the body member. In an exemplary embodiment, the device comprises one or more handles connected to the body member.

A device has been described that is adapted to be coupled to a first tubular support within which a second tubular support at least partially extends, the device comprising a body member; an opening in the body member within which the second tubular support is adapted to at least partially extend when the device is coupled to the first tubular support; and an internal recess in the body member within which the first tubular support is adapted to at least partially extend when the device is coupled to the first tubular support; wherein the internal recess defines an internal shoulder with which the first tubular support is adjacent when the device is coupled to the first tubular support and the first tubular support at least partially extends within the internal recess; wherein movement of the first tubular support, in an axial direction and relative to the second tubular support, is generally prevented when the device is coupled to the first tubular support and the first tubular support at least partially extends within the internal recess; wherein the device further comprises first and second bores formed through the body member; first and second fasteners extending through the first and second bores, respectively, and into the internal recess; and one or more handles connected to the body member; wherein the first and second fasteners are adapted to further extend into first and second radial openings, respectively, in the first tubular support when the device is coupled to the first tubular support and the first tubular support at least partially extends within the internal recess; wherein the opening defines a first internal arcuate surface of the body member and first and second parallel-spaced surfaces of the body member extending from the first internal arcuate surface of the body member; and wherein the internal recess defines a second internal arcuate surface of the body member and third and fourth parallel-spaced surfaces of the body member extending from the second internal arcuate surface of the body member.

A method has been described that includes assembling a tension actuator assembly, comprising coupling at least one subassembly to at least one other subassembly; and positioning the tension actuator assembly within a wellbore. In an exemplary embodiment, positioning the tension actuator assembly within the wellbore comprises positioning at least a portion of the at least one other subassembly within the wellbore during assembling the tension actuator assembly. In an exemplary embodiment, the at least one subassembly comprises a first tubular support and a second tubular support at least partially positioned within the first tubular support; and wherein coupling the at least one subassembly to the at least one other subassembly comprises coupling the at least one other subassembly to the at least one subassembly. In an exemplary embodiment, the method further comprises preventing the first tubular support from moving in an axial direction relative to the second tubular support during coupling the at least one subassembly to the at least one other subassembly. In an exemplary embodiment, the method comprises preventing the second tubular support from moving in the axial direction relative to the first tubular support during coupling the at least one subassembly to the at least one other subassembly. In an exemplary embodiment, the first tubular support comprises an internal shoulder; and wherein preventing the second tubular support from moving in the axial direction relative to the first tubular support during coupling the at least one subassembly to the at least one other subassembly comprises coupling a retaining ring to the second tubular support; and engaging the retaining ring with the internal shoulder of the first tubular support. In an exemplary embodiment, the method comprises preventing the first tubular support from moving in the axial direction relative to the second tubular support during coupling the at least one subassembly to the at least one other subassembly comprises coupling a device to the first tubular support, the device comprising a body member; an opening in the body member within which the second tubular support at least partially extends after the device is coupled to the first tubular support; and an internal recess in the body member within which the first tubular support at least partially extends after the device is coupled to the first tubular support. In an exemplary embodiment, the method comprises decoupling the device from the first tubular support. In an exemplary embodiment, positioning the tension actuator assembly within the wellbore further comprises positioning at least a portion of the at least one subassembly within the wellbore during assembling the tension actuator assembly.

A method has been described that includes assembling a tension actuator assembly, comprising coupling at least one subassembly to at least one other subassembly; and positioning the tension actuator assembly within a wellbore; wherein coupling the at least one subassembly to the at least one other subassembly comprises coupling the at least one other subassembly to the at least one subassembly; wherein the at least one subassembly comprises a first tubular support and a second tubular support at least partially positioned within the first tubular support; wherein the method further comprises preventing the first tubular support from moving in an axial direction relative to the second tubular support during coupling the at least one subassembly to the at least one other subassembly wherein the method further comprises preventing the second tubular support from moving in the axial direction relative to the first tubular support during coupling the at least one subassembly to the at least one other subassembly; wherein the first tubular support comprises an internal shoulder; wherein preventing the first tubular support from moving in the axial direction relative to the second tubular support during coupling the at least one subassembly to the at least one other subassembly comprises coupling a device to the first tubular support, the device comprising a body member; an opening in the body member within which the second tubular support at least partially extends after the device is coupled to the first tubular support; and an internal recess in the body member within which the first tubular support at least partially extends after the device is coupled to the first tubular support; and wherein the method further comprises decoupling the device from the first tubular support.

A method has been described that includes coupling a first subassembly to a second subassembly, the first subassembly comprising a first tubular support and a second tubular support at least partially positioned within the first tubular support; preventing the first tubular support from moving in an axial direction relative to the second tubular support during coupling the first subassembly to the second subassembly, comprising coupling a device to the first tubular support, the device comprising a body member; an opening in the body member within which the second tubular support at least partially extends after the device is coupled to the first tubular support; and an internal recess in the body member within which the first tubular support at least partially extends after the device is coupled to the first tubular support. In an exemplary embodiment, the internal recess defines an internal shoulder with which the first tubular support is adjacent when the device is coupled to the first tubular support and the first tubular support at least partially extends within the internal recess. In an exemplary embodiment, the device comprises first and second bores formed through the body member; and first and second fasteners extending through the first and second bores, respectively, and into the internal recess. In an exemplary embodiment, the first and second fasteners are adapted to further extend into first and second radial openings, respectively, in the first tubular support when the device is coupled to the first tubular support and the first tubular support at least partially extends within the internal recess. In an exemplary embodiment, the opening defines a first internal arcuate surface of the body member and first and second parallel-spaced surfaces of the body member extending from the first internal arcuate surface of the body member. In an exemplary embodiment, the internal recess defines a second internal arcuate surface of the body member and third and fourth parallel-spaced surfaces of the body member extending from the second internal arcuate surface of the body member.

A method has been described that includes coupling a first subassembly to a second subassembly, the first subassembly comprising a first tubular support and a second tubular support at least partially positioned within the first tubular support; preventing the first tubular support from moving in an axial direction relative to the second tubular support during coupling the first subassembly to the second subassembly, comprising coupling a device to the first tubular support, the device comprising a body member; an opening in the body member within which the second tubular support at least partially extends after the device is coupled to the first tubular support; and an internal recess in the body member within which the first tubular support at least partially extends after the device is coupled to the first tubular support wherein the internal recess defines an internal shoulder with which the first tubular support is adjacent when the device is coupled to the first tubular support and the first tubular support at least partially extends within the internal recess; wherein the device further comprises first and second bores formed through the body member; and first and second fasteners extending through the first and second bores, respectively, and into the internal recess; wherein the first and second fasteners are adapted to further extend into first and second radial openings, respectively, in the first tubular support when the device is coupled to the first tubular support and the first tubular support at least partially extends within the internal recess; wherein the opening defines a first internal arcuate surface of the body member and first and second parallel-spaced surfaces of the body member extending from the first internal arcuate surface of the body member; and wherein the internal recess defines a second internal arcuate surface of the body member and third and fourth parallel-spaced surfaces of the body member extending from the second internal arcuate surface of the body member.

A system has been described that includes means for assembling a tension actuator assembly, comprising means for coupling at least one subassembly to at least one other subassembly; and means for positioning the tension actuator assembly within a wellbore. In an exemplary embodiment, means for positioning the tension actuator assembly within the wellbore comprises means for positioning at least a portion of the at least one other subassembly within the wellbore during assembling the tension actuator assembly. In an exemplary embodiment, the at least one subassembly comprises a first tubular support and a second tubular support at least partially positioned within the first tubular support; and means for coupling the at least one subassembly to the at least one other subassembly comprises means for coupling the at least one other subassembly to the at least one subassembly. In an exemplary embodiment, the system further comprises means for preventing the first tubular support from moving in an axial direction relative to the second tubular support during coupling the at least one subassembly to the at least one other subassembly. In an exemplary embodiment, the system comprises means for preventing the second tubular support from moving in the axial direction relative to the first tubular support during coupling the at least one subassembly to the at least one other subassembly. In an exemplary embodiment, the first tubular support comprises an internal shoulder; and wherein means for preventing the second tubular support from moving in the axial direction relative to the first tubular support during coupling the at least one subassembly to the at least one other subassembly comprises means for coupling a retaining ring to the second tubular support; and means for engaging the retaining ring with the internal shoulder of the first tubular support. In an exemplary embodiment, the system comprises means for preventing the first tubular support from moving in the axial direction relative to the second tubular support during coupling the at least one subassembly to the at least one other subassembly comprises means for coupling a device to the first tubular support, the device comprising a body member; an opening in the body member within which the second tubular support at least partially extends after the device is coupled to the first tubular support; and an internal recess in the body member within which the first tubular support at least partially extends after the device is coupled to the first tubular support. In an exemplary embodiment, the system comprises means for decoupling the device from the first tubular support. In an exemplary embodiment, means for positioning the tension actuator assembly within the wellbore further comprises means for positioning at least a portion of the at least one subassembly within the wellbore during assembling the tension actuator assembly.

A system has been described that includes means for assembling a tension actuator assembly, comprising means for coupling at least one subassembly to at least one other subassembly; and means for positioning the tension actuator assembly within a wellbore; wherein the at least one subassembly comprises a first tubular support and a second tubular support at least partially positioned within the first tubular support; wherein means for coupling the at least one subassembly to the at least one other subassembly comprises means for coupling the at least one other subassembly to the at least one subassembly; wherein the system further comprises means for preventing the first tubular support from moving in an axial direction relative to the second tubular support during coupling the at least one subassembly to the at least one other subassembly; wherein the system further comprises means for preventing the second tubular support from moving in the axial direction relative to the first tubular support during coupling the at least one subassembly to the at least one other subassembly; wherein the first tubular support comprises an internal shoulder; wherein means for preventing the first tubular support from moving in the axial direction relative to the second tubular support during coupling the at least one subassembly to the at least one other subassembly comprises means for coupling a device to the first tubular support, the device comprising a body member; an opening in the body member within which the second tubular support at least partially extends after the device is coupled to the first tubular support; and an internal recess in the body member within which the first tubular support at least partially extends after the device is coupled to the first tubular support; and wherein the system further comprises means for decoupling the device from the first tubular support.

A system has been described that includes means for coupling a first subassembly to a second subassembly, the first subassembly comprising a first tubular support and a second tubular support at least partially positioned within the first tubular support; means for preventing the first tubular support from moving in an axial direction relative to the second tubular support during coupling the first subassembly to the second subassembly, comprising means for coupling a device to the first tubular support, the device comprising a body member; an opening in the body member within which the second tubular support at least partially extends after the device is coupled to the first tubular support; and an internal recess in the body member within which the first tubular support at least partially extends after the device is coupled to the first tubular support. In an exemplary embodiment, the internal recess defines an internal shoulder with which the first tubular support is adjacent when the device is coupled to the first tubular support and the first tubular support at least partially extends within the internal recess. In an exemplary embodiment, the device further comprises first and second bores formed through the body member; and first and second fasteners extending through the first and second bores, respectively, and into the internal recess. In an exemplary embodiment, the first and second fasteners are adapted to further extend into first and second radial openings, respectively, in the first tubular support when the device is coupled to the first tubular support and the first tubular support at least partially extends within the internal recess. In an exemplary embodiment, the opening defines a first internal arcuate surface of the body member and first and second parallel-spaced surfaces of the body member extending from the first internal arcuate surface of the body member. In an exemplary embodiment, the internal recess defines a second internal arcuate surface of the body member and third and fourth parallel-spaced surfaces of the body member extending from the second internal arcuate surface of the body member.

A system has been described that includes means for coupling a first subassembly to a second subassembly, the first subassembly comprising a first tubular support and a second tubular support at least partially positioned within the first tubular support; means for preventing the first tubular support from moving in an axial direction relative to the second tubular support during coupling the first subassembly to the second subassembly, comprising means for coupling a device to the first tubular support, the device comprising a body member; an opening in the body member within which the second tubular support at least partially extends after the device is coupled to the first tubular support; and an internal recess in the body member within which the first tubular support at least partially extends after the device is coupled to the first tubular support; wherein the internal recess defines an internal shoulder with which the first tubular support is adjacent when the device is coupled to the first tubular support and the first tubular support at least partially extends within the internal recess; wherein the device further comprises first and second bores formed through the body member; and first and second fasteners extending through the first and second bores, respectively, and into the internal recess; wherein the first and second fasteners are adapted to further extend into first and second radial openings, respectively, in the first tubular support when the device is coupled to the first tubular support and the first tubular support at least partially extends within the internal recess; wherein the opening defines a first internal arcuate surface of the body member and first and second parallel-spaced surfaces of the body member extending from the first internal arcuate surface of the body member; and wherein the internal recess defines a second internal arcuate surface of the body member and third and fourth parallel-spaced surfaces of the body member extending from the second internal arcuate surface of the body member.

It is understood that variations may be made in the foregoing without departing from the scope of the invention. For example, the teachings of the present illustrative embodiments may be used to provide a wellbore casing, a pipeline, or a structural support. Furthermore, the elements and teachings of the various illustrative embodiments may be combined in whole or in part in some or all of the illustrative embodiments. In addition, one or more of the elements and teachings of the various illustrative embodiments may be omitted, at least in part, and/or combined, at least in part, with one or more of the other elements and teachings of the various illustrative embodiments.

Although illustrative embodiments of the invention have been shown and described, a wide range of modification, changes and substitution is contemplated in the foregoing disclosure. In some instances, some features of the present invention may be employed without a corresponding use of the other features. Accordingly, it is appropriate that the appended claims be construed broadly and in a manner consistent with the scope of the invention. In the claims, means-plus-function clauses are intended to cover the structures described herein as performing the recited function and not only structural equivalents, but also equivalent structures.

What is claimed is:

1. An apparatus for radially expanding and plastically deforming an expandable tubular member, comprising:

a support member;

an adjustable expansion device for radially expanding and plastically deforming the tubular member coupled to the support member, wherein the adjustable expansion device comprises:

a tubular support member comprising a plurality of circumferentially spaced apart inclined surfaces;

a plurality of circumferentially spaced apart expansion segments movably coupled to the tubular support member; and a retaining device coupled between the tubular support member and each of the expansion segments, the retaining device deformable to maintain each of the expansion segments proximate the corresponding inclined surface; and an actuator for displacing the expansion segments relative to the tubular support member to thereby displace each of the expansion segments onto corresponding inclined surfaces.

2. The apparatus of claim 1, further comprising:

a sensor operably coupled to the actuator adapted to sense one or more operational conditions proximate the actuator.

3. The apparatus of claim 2, further comprising:

a controller operably coupled to the sensor and the actuator adapted to control the operation of the actuator as a function of one or more of the operational conditions proximate the actuator.

4. The apparatus of claim 1, further comprising:

a controller operably coupled to a sensor and the actuator adapted to control the operation of the actuator.

5. The apparatus of claim 1, wherein the actuator comprises an hydraulic actuator.

6. The apparatus of claim 5, further comprising:

a variable orifice operably coupled to the hydraulic actuator adapted to control a flow of fluidic materials into the hydraulic actuator.

7. The apparatus of claim 6, further comprising:

a sensor operably coupled to the hydraulic actuator adapted to sense one or more operational conditions proximate the hydraulic actuator.

8. The apparatus of claim 7, further comprising:

a controller operably coupled to the sensor and the actuator adapted to control the operation of the variable orifice as a function of one or more of the operational conditions proximate the actuator.

9. The apparatus of claim 6, further comprising:

a controller operably coupled to the variable orifice and the actuator adapted to control the operation of the variable orifice.

10. The apparatus of claim 1, wherein the retaining device comprises:

a tubular retaining member movably coupled to the tubular support member; and a plurality of circumferentially spaced apart, deformable retaining arms extending from the tubular retaining member coupled to corresponding expansion segments.

11. The apparatus of claim 1, wherein each of the expansion segments comprises:

a body member; and an insert member coupled to the body member having increased surface hardness.

12. An apparatus for radially expanding and plastically deforming an expandable tubular member, comprising:

a support member; and an adjustable expansion device for radially expanding and plastically deforming the tubular member coupled to the support member, wherein the adjustable expansion device comprises:

a tubular support member comprising a plurality of circumferentially spaced apart inclined surfaces;

a plurality of circumferentially spaced apart expansion segments movably coupled to the tubular support member;

an hydraulic actuator for displacing the expansion segments relative to the tubular support member to thereby displace each of the expansion segments onto corresponding inclined surfaces;

a variable orifice operably coupled to the hydraulic actuator adapted to control a flow of fluidic materials into the hydraulic actuator;

a sensor operably coupled to the hydraulic actuator adapted to sense one or more operational conditions proximate the hydraulic actuator;

a controller operably coupled to the sensor and the variable orifice adapted to control the operation of the variable orifice as a function of one or more of the operational conditions proximate the hydraulic actuator;

a tubular retaining member movably coupled to the tubular support member; and a plurality of circumferentially spaced apart retaining arms extending from the tubular retaining member and coupled to corresponding expansion segments, wherein the retaining arms are deformable to maintain each of the expansion segments proximate the corresponding inclined surface;

wherein each of the expansion segments comprises:

a body member; and an insert member coupled to the body member having increased surface hardness; and wherein the body member of the expansion segment comprises:

a first portion comprising an arcuate cylindrical outer surface; and a second portion coupled to the first portion comprising an arcuate conical outer surface.

13. An apparatus for radially expanding and plastically deforming an expandable tubular member, comprising:

a support member;

a gripping device for gripping the tubular member coupled to the support member;

a sealing device for sealing an interface with the tubular member coupled to the support member;

a locking device for locking the position of the tubular member relative to the support member;

an adjustable expansion device for radially expanding and plastically deforming the tubular member coupled to the support member;

a packer coupled to the support member; and an actuator for displacing one or more of the sealing device, the adjustable expansion device, and the packer relative to the support member;

wherein the adjustable expansion device comprises:

a tubular support member comprising a plurality of circumferentially spaced apart inclined surfaces;

a plurality of circumferentially spaced apart expansion segments movably coupled to the tubular support member; and an actuator for displacing the expansion segments relative to the tubular support member to thereby displace each of the expansion segments onto corresponding inclined surfaces.

14. A method of radially expanding and plastically deforming an expandable tubular member, comprising:

positioning an adjustable expansion device within the tubular member; and increasing the size of the adjustable expansion device within the tubular member to radially expand and plastically deform the tubular member;

wherein increasing the size of the adjustable expansion device comprises:

injecting fluidic material into the adjustable expansion device;

displacing a plurality of circumferentially spaced apart expansion elements along corresponding ramped surfaces;

deforming a plurality of circumferentially spaced apart coupling elements to maintain the expansion elements proximate the ramped surfaces;

monitoring one or more operating conditions proximate the adjustable expansion device; and controlling the injection of the fluidic material into the adjustable expansion device as a function of the operating conditions.

15. A method of radially expanding and plastically deforming an expandable tubular member within a preexisting structure, comprising:

positioning an expansion device within the tubular member;

positioning the tubular member within the preexisting structure; and increasing the size of the expansion device within the tubular member to radially expand and plastically deform the tubular member;

wherein increasing the size of the expansion device comprises:

injecting fluidic material into the expansion device;

displacing a plurality of circumferentially spaced apart expansion elements along corresponding ramped surfaces;

deforming a plurality of circumferentially spaced apart coupling elements to maintain the expansion elements proximate the ramped surfaces;

monitoring one or more operating conditions proximate the expansion device; and controlling the injection of the fluidic material into the expansion device as a function of the operating conditions.

16. A system for radially expanding and plastically deforming an expandable tubular member, comprising:

means for positioning an adjustable expansion device within the tubular member; and means for increasing the size of the adjustable expansion device within the tubular member to radially expand and plastically deform the tubular member;

wherein means for increasing the size of the adjustable expansion device comprises:

means for injecting fluidic material into the adjustable expansion device;

means for displacing a plurality of circumferentially spaced apart expansion elements along corresponding ramped surfaces;

means which is deformable to maintain the expansion elements proximate the ramped surfaces;

means for monitoring one or more operating conditions proximate the adjustable expansion device; and means for controlling the injection of the fluidic material into the adjustable expansion device as a function of the operating conditions.

17. A system for radially expanding and plastically deforming an expandable tubular member within a preexisting structure, comprising:

means for positioning an expansion device within the tubular member;

means for positioning the tubular member within the preexisting structure; and means for increasing the size of the expansion device within the tubular member to radially expand and plastically deform the tubular member;

wherein means for increasing the size of the expansion device comprises:

means for injecting fluidic material into the expansion device;

means for displacing a plurality of circumferentially spaced apart expansion elements along corresponding ramped surfaces;

means which is deformable to maintain the expansion elements proximate the ramped surfaces;

means for monitoring one or more operating conditions proximate the expansion device; and means for controlling the injection of the fluidic material into the expansion device as a fraction of the operating conditions.

* * * * *

UNITED STATES PATENT AND TRADEMARK OFFICE

CERTIFICATE OF CORRECTION

PATENT NO. : 7,546,881 B2
APPLICATION NO. : 11/552703
DATED : October 25, 2006
INVENTOR(S) : Sam Sun Lloyd et al.

It is certified that error appears in the above-identified patent and that said Letters Patent is hereby corrected as shown below:

Title page, item (75) Inventors: should read as follows:

Sam Sun Lloyd, Houston, TX (US); Lev Ring, Houston, TX (US); David Paul Brisco, Duncan, OK (US); Kevin K. Waddell, Houston, TX (US); Robert Lance Cook, Katy, TX (US); Brock Wayne Watson, Carrollton, TX (US); Harold Otis Treece, Duncan, OK (US); Edwin Arnold Zwald, Jr., Houston, TX (US); Akin Olufowoshe, Katy, TX (US); Charles A. Butterfield, Jr., Cypress, TX (US)

Signed and Sealed this

Twenty-eighth Day of July, 2009

JOHN DOLL
*Acting Director of the United States Patent and Trademark Office*